US007186090B2

(12) United States Patent
Tomberg et al.

(10) Patent No.: US 7,186,090 B2
(45) Date of Patent: Mar. 6, 2007

(54) AIR FOIL SHAPE FOR A COMPRESSOR BLADE

(75) Inventors: Steven Eric Tomberg, Simpsonville, SC (US); Roger Beharrysingh, Simpsonville, SC (US); Timothy E. DeJoris, Mauldin, SC (US); William J. Miller, Simpsonville, SC (US); Paul Deivernois, Greer, SC (US); Venkata Siva P. Chaluvadi, Mauldin, SC (US); Adrian Mircea Mistreanu, Greenville, SC (US); Michael James Dutka, Simpsonville, SC (US); Nathan S. Race, Pendleton, SC (US); Jeffrey Boyd, Greenville, SC (US); Christopher David McGowan, Greenville, SC (US); Peter Gaines Cleveland, Greenville, SC (US); Jason Thomas Harrell, Centerville, MA (US); Carl G. Schott, Simpsonville, SC (US); John David Stampfli, Greer, SC (US); Ronald Stuart Denmark, Greenville, SC (US); Steven Mark Schirle, Anderson, SC (US); Jennifer B. Michenfelder, Fountain Inn, SC (US); John F. Ryman, Taylors, SC (US)

(73) Assignee: General Electric Company, Schenectady, NY (US)

( * ) Notice: Subject to any disclaimer, the term of this patent is extended or adjusted under 35 U.S.C. 154(b) by 116 days.

(21) Appl. No.: 10/986,162

(22) Filed: Nov. 12, 2004

(65) Prior Publication Data

US 2006/0073014 A1 Apr. 6, 2006

Related U.S. Application Data

(63) Continuation-in-part of application No. 10/911,742, filed on Aug. 5, 2004, now abandoned.

(51) Int. Cl.
*F01D 5/14* (2006.01)

(52) U.S. Cl. ..... 416/223 A; 416/DIG. 2; 416/DIG. 5

(58) Field of Classification Search ..... 415/208.3, 415/211.2; 416/223 A, DIG. 2, DIG. 5
See application file for complete search history.

(56) References Cited

U.S. PATENT DOCUMENTS 6,299,412 B1 10/2001 Wood et al.

(Continued)

OTHER PUBLICATIONS

U.S. Appl. No. 10/900,200, filed Jul. 28, 2004, entitled: Airfoil Shape and Sidewall Flowpath Surfaces for a Turbine Nozzle.

(Continued)

*Primary Examiner*—Edward K. Look
*Assistant Examiner*—Devin Hanan
(74) *Attorney, Agent, or Firm*—Nixon & Vanderhye P.C.

(57) ABSTRACT

An article of manufacture having a nominal profile substantially in accordance with Cartesian coordinate values of X, Y and Z set forth in a table. The table selected from the group of tables consisting of TABLES 1S–16S, 1R–17R, and IGV. Wherein X and Y are distances in inches which, when connected by smooth continuing arcs, define airfoil profile sections at each distance Z in inches. The profile sections at the Z distances being joined smoothly with one another to form a complete airfoil shape.

15 Claims, 4 Drawing Sheets

U.S. PATENT DOCUMENTS 6,331,100 B1 12/2001 Liu et al.
6,398,489 B1 6/2002 Burdgick et al.
6,435,815 B2 8/2002 Harvey et al.
6,450,770 B1 9/2002 Wang et al.
6,461,109 B1 10/2002 Wedlake et al.
6,461,110 B1 10/2002 By et al.
6,474,948 B1 11/2002 Pirolla et al.
6,503,054 B1 1/2003 Bielek et al.
6,503,059 B1 1/2003 Frost et al.
6,558,122 B1 5/2003 Xu et al.
6,685,434 B1 2/2004 Humanchuk et al.
6,709,239 B2 3/2004 Chandraker
6,715,990 B1 4/2004 Arness et al.
6,722,852 B1 4/2004 Wedlake et al.
6,722,853 B1 * 4/2004 Humanchuk et al. ... 416/223 A
6,739,838 B1 5/2004 Bielek et al.
6,769,879 B1 8/2004 Cleveland et al.
6,779,977 B2 8/2004 Lagrange et al.
6,779,980 B1 * 8/2004 Brittingham et al. ..... 416/243
6,808,368 B1 10/2004 Tomberg et al.
6,832,897 B2 12/2004 Urban
6,854,961 B2 2/2005 Zhang et al.
6,857,855 B1 * 2/2005 Snook et al. ..... 416/223 A
6,866,477 B2 3/2005 Arness et al.
6,881,038 B1 4/2005 Beddard et al.
6,884,038 B2 4/2005 Hyde et al.
6,910,868 B2 6/2005 Hyde et al.

OTHER PUBLICATIONS

U.S. Appl. No. 10/853,240, filed May 26, 2004, entitled: Internal Core Profile for a Turbine Nozzle Airfoil.
U.S. Appl. No. 11/226,264, filed Sep. 15, 2004, entitled: Rotor Blade for a First Phase of a Gas Turbine.
U.S. Appl. No. 11/090,300, filed Mar. 28, 2005, entitled: First and Second Stage Turbine Airfoil Shapes.

* cited by examiner

AIR FOIL SHAPE FOR A COMPRESSOR BLADE

This application is a continuation in part of U.S. Ser. No. 10/911,742 filed Aug. 5, 2004 now abandoned, the entire contents thereof are incorporated herein.

BACKGROUND OF THE INVENTION

The present invention relates to airfoils for a rotor blade of a gas turbine. In particular, the invention relates to compressor airfoil profiles for various stages of the compressor. In particular, the invention relates to compressor airfoil profiles for either inlet guide vanes, rotors, or stators at various stages of the compressor.

In a gas turbine, many system requirements should be met at each stage of a gas turbine's flow path section to meet design goals. These design goals include, but are not limited to, overall improved efficiency and airfoil loading capability. For example, and in no way limiting of the invention, a blade of a compressor stator should achieve thermal and mechanical operating requirements for that particular stage. Further, for example, and in no way limiting of the invention, a blade of a compressor rotor should achieve thermal and mechanical operating requirements for that particular stage.

BRIEF DESCRIPTION OF THE INVENTION

In accordance with one aspect of the instant invention, an article of manufacture having a nominal profile substantially in accordance with Cartesian coordinate values of X, Y and Z set forth in a table. The table selected from the group of tables consisting of TABLES 1S–16S, 1R–17R, and IGV. Wherein X and Y are distances in inches which, when connected by smooth continuing arcs, define airfoil profile sections at each distance Z in inches. The profile sections at the Z distances being joined smoothly with one another to form a complete airfoil shape.

In accordance with another aspect of the instant invention, a compressor comprising a compressor wheel. The compressor wheel having a plurality of articles of manufacture. Each of the articles of manufacture including an airfoil having an airfoil shape. The airfoil having a nominal profile substantially in accordance with Cartesian coordinate values of X, Y and Z set forth in a table. The table selected from the group of tables consisting of TABLES 1S–16S, 1R–17R, and IGV. Wherein X and Y are distances in inches which, when connected by smooth continuing arcs, define airfoil profile sections at each distance Z in inches. The profile sections at the Z distances being joined smoothly with one another to form a complete airfoil shape.

In accordance with yet another aspect of the instant invention, a compressor comprising a compressor wheel having a plurality of articles of manufacture. Each of the articles of manufacture including an airfoil having an uncoated nominal airfoil profile substantially in accordance with Cartesian coordinate values of X, Y and Z set forth in a table. The table selected from the group of tables consisting of TABLES 1S–16S, 1R–17R, and IGV. Wherein X and Y are distances in inches which, when connected by smooth continuing arcs, define airfoil profile sections at each distance Z in inches. The profile sections at the Z distances being joined smoothly with one another to form a complete airfoil shape.

DETAILED DESCRIPTION OF THE INVENTION

Figure 1:
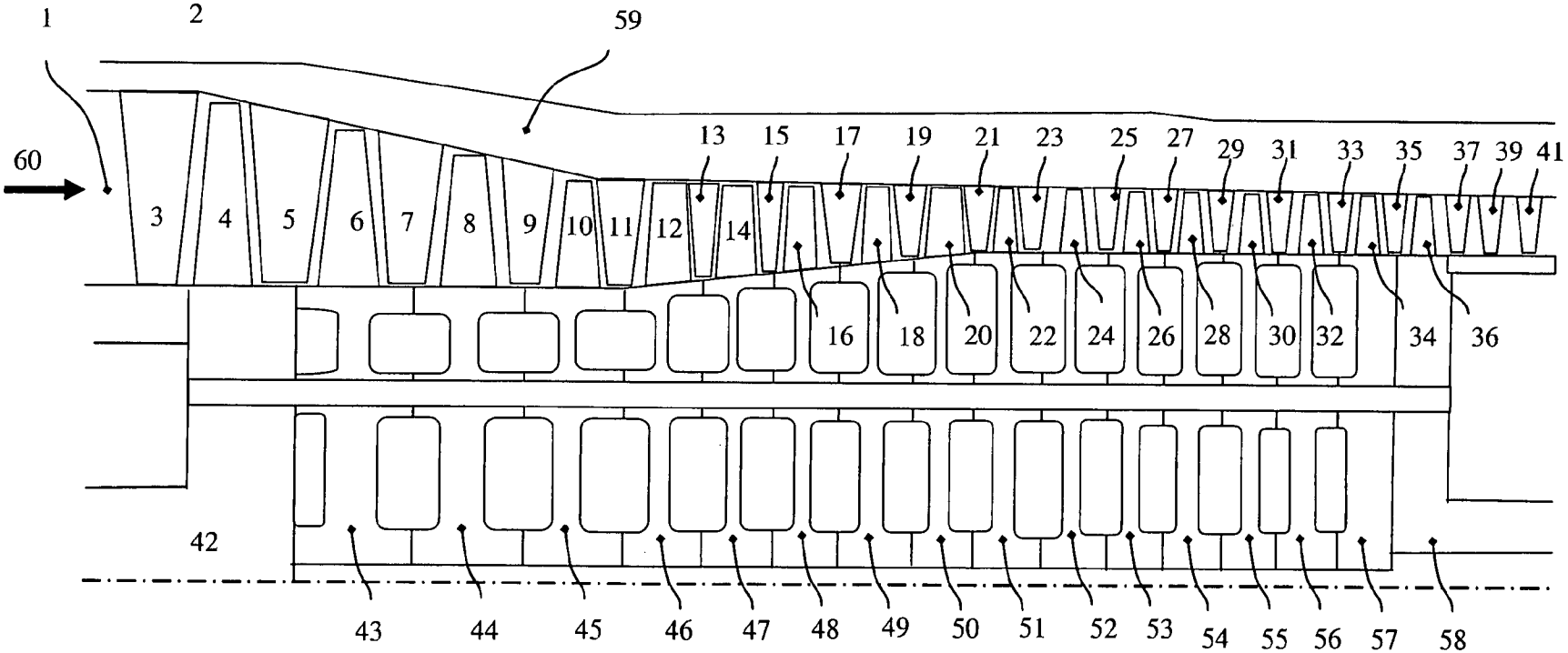
FIG. 1 is a schematic representation of a compressor flow path through multiple stages of a gas turbine and illustrates an exemplary tenth stage rotor blade airfoil according to an embodiment of the invention.
Figure 2:
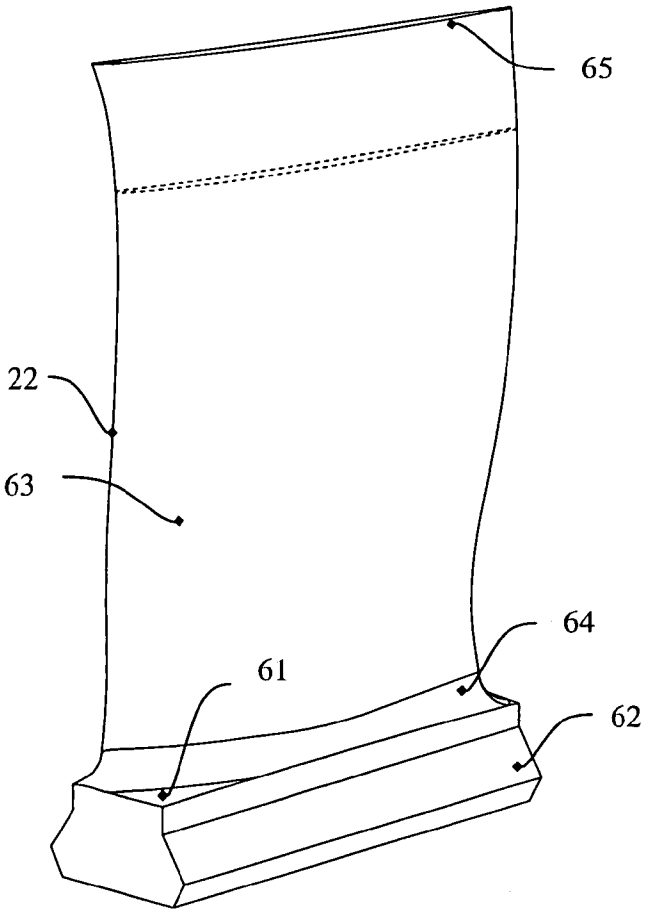
FIGS. 2 and 3 are respective perspective views of a rotor blade according to an embodiment of the invention with the rotor blade airfoil illustrated in conjunction with its platform and its substantially or near axial entry dovetail connection.
Figure 3:
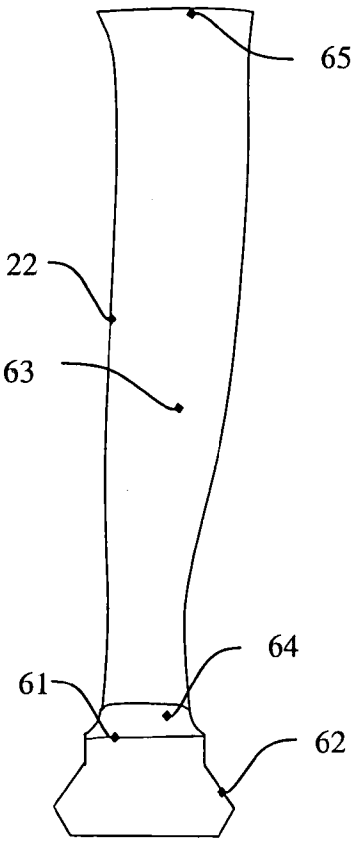
Figure 4:
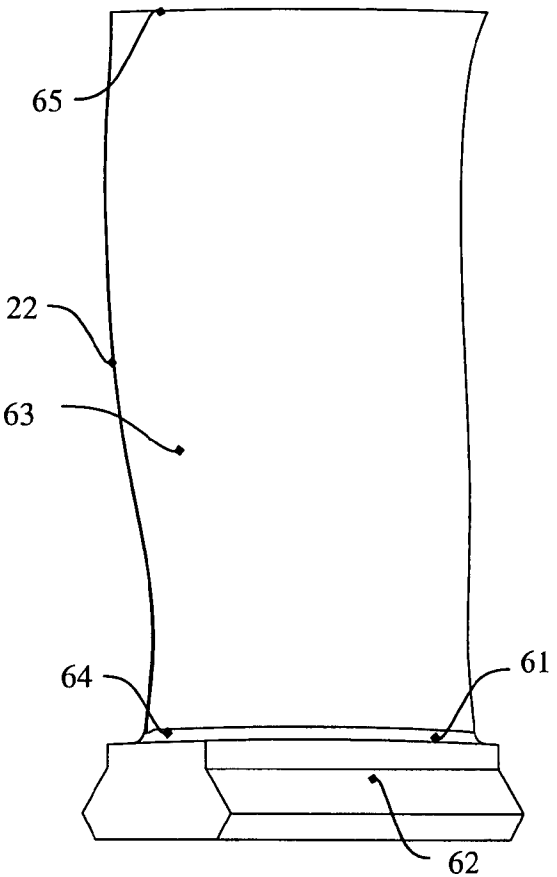
FIGS. 4 and 5 are side elevational views of the rotor blade of FIG. 2 and associated platform and dovetail connection as viewed in a generally circumferential direction from the pressure and suction sides of the airfoil, respectively.

Referring now to the drawings, FIG. 1 illustrates an axial compressor flow path 1 of a gas turbine compressor 2 includes a plurality of compressor stages. The compressor stages are sequentially numbered in the Figure. The compressor flow path comprises seventeen rotor stages and stator stages. However, the exact number of rotor and stator stages is a choice of engineering design. Any number of rotor and stator stages can be provided in the combustor, as embodied by the invention. The seventeen rotor stages are merely exemplary of one turbine design. The seventeen rotor stages are not intended to limit the invention in any manner.

The compressor rotor blades impart kinetic energy to the airflow and therefore bring about a desired pressure rise. Directly following the rotor airfoils is a stage of stator airfoils. Both the rotor and stator airfoils turn the airflow, slow the airflow velocity (in the respective airfoil frame of reference), and yield a rise in the static pressure of the airflow. Typically, multiple rows of rotor/stator stages are stacked in axial flow compressors to achieve a desired discharge to inlet pressure ratio. Rotor and stator airfoils can be secured to rotor wheels or stator case by an appropriate attachment configuration, often known as a "root", "base" or "dovetail" (see FIGS. 2–5).

A tenth stage of the compressor 2 is exemplarily illustrated in FIG. 1. The tenth stage of the compressor 2 comprises a plurality of circumferentially spaced rotor blades 22 mounted on a rotor wheel 51 and a plurality of circumferentially spaced stator blades 23 attached to a static compressor case 59. Each of the rotor wheels is attached to aft drive shaft 58, which is connected to the turbine section of the engine. The rotor blades and stator blades lie in the flow path 1 of the compressor. The direction of airflow through the compressor flow path 1, as embodied by the invention, is indicated by the arrow 60 (FIG. 1). The tenth stage of the compressor 2 is merely exemplarily of the stages of the compressor 2 within the scope of the invention. The tenth stage of the compressor 2 is not intended to limit the invention in any manner.

Figure 6:
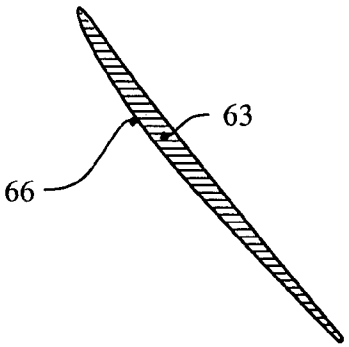
FIG. 6 is a cross-sectional view of the rotor blade airfoil taken generally about on line 6—6 in FIG. 5.

The rotor blades 22 are mounted on the rotor wheel 51 forming part of aft drive shaft 58. Each rotor blade 22, as illustrated in FIGS. 2–6, is provided with a platform 61, and substantially or near axial entry dovetail 62 for connection with a complementary-shaped mating dovetail, not shown, on the rotor wheel 51. An axial entry dovetail, however, may be provided with the airfoil profile, as embodied by the invention. Each rotor blade 22 comprises a rotor blade airfoil 63, as illustrated in FIGS. 2–6. Thus, each of the rotor blades 22 has a rotor blade airfoil profile 66 at any cross-section from the airfoil root 64 at a midpoint of platform 61 to the rotor blade tip 65 in the general shape of an airfoil (FIG. 6).

To define the airfoil shape of the rotor blade airfoil, a unique set or loci of points in space are provided. This unique set or loci of points meet the stage requirements so the stage can be manufactured. This unique loci of points also meets the desired requirements for stage efficiency and reduced thermal and mechanical stresses. The loci of points are arrived at by iteration between aerodynamic and mechanical loadings enabling the compressor to run in an efficient, safe and smooth manner.

The loci, as embodied by the invention, defines the rotor blade airfoil profile and can comprise a set of points relative to the axis of rotation of the engine. For example, a set of points can be provided to define a rotor blade airfoil profile.

Figure 8:
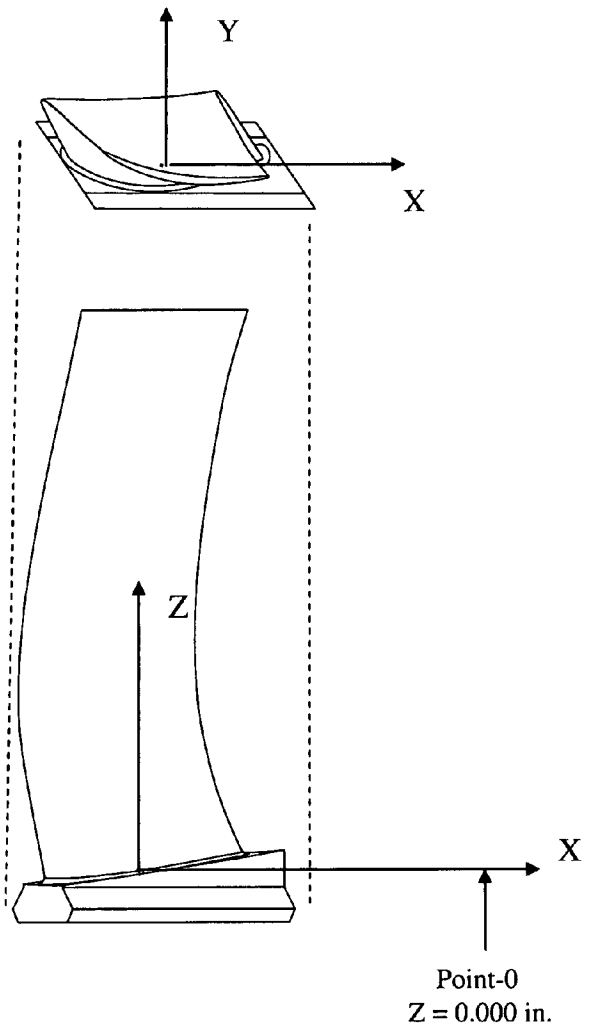
FIG. 8 is a perspective views of a stator blade according to an embodiment of the invention with coordinate system superimposed thereon.
Figure 7:
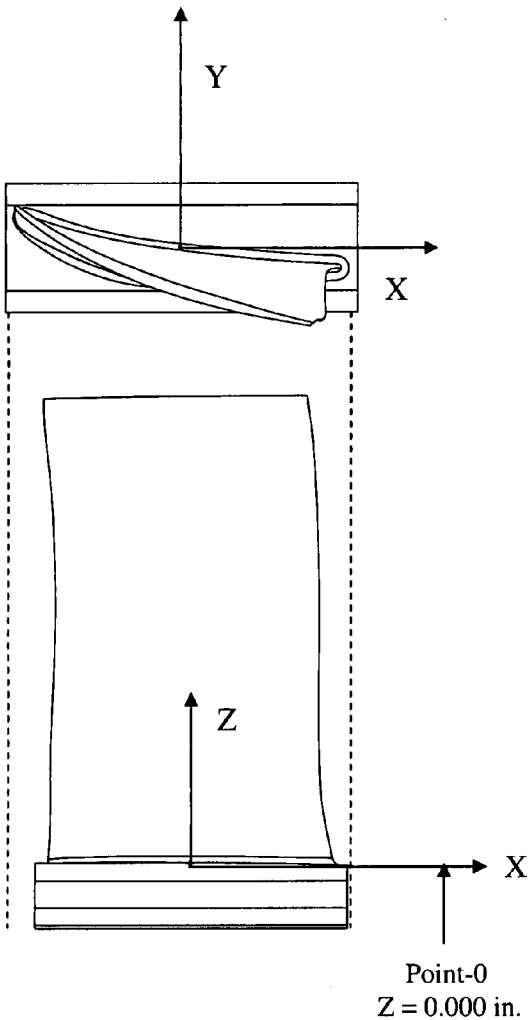
FIG. 7 is a perspective views of a rotor blade according to an embodiment of the invention with coordinate system superimposed thereon.

A Cartesian coordinate system of X, Y and Z values given in the Tables below defines a profile of a rotor blade airfoil at various locations along its length. The coordinate values for the X, Y and Z coordinates are set forth in inches, although other units of dimensions may be used when the values are appropriately converted. These values exclude fillet regions of the platform. The Cartesian coordinate system has orthogonally-related X, Y and Z axes. The X axis lies parallel to the compressor blade's dovetail axis, which is at a angle to the engine's centerline, as illustrated in FIG. 7 for a rotor and FIG. 8 for a stator. A positive X coordinate value is axial toward the aft, for example the exhaust end of the compressor. A positive Y coordinate value directed normal to the dovetail axis. A positive Z coordinate value is directed radially outward toward tip of the airfoil, which is towards the static casing of the compressor for rotor blades, and directed radially inward towards the engine centerline of the compressor for stator blades.

By defining X and Y coordinate values at selected locations in a Z direction normal to the X, Y plane, the profile section of the rotor blade airfoil, such as, but not limited to the profile section 66 in FIG. 6, at each Z distance along the length of the airfoil can be ascertained. By connecting the X and Y values with smooth continuing arcs, each profile section 66 at each distance Z can be fixed. The airfoil profiles of the various surface locations between the distances Z are determined by smoothly connecting the adjacent profile sections 66 to one another, thus forming the airfoil profile. These values represent the airfoil profiles at ambient, non-operating or non-hot conditions and are for an uncoated airfoil.

The table values are generated and shown to three decimal places for determining the profile of the airfoil. There are typical manufacturing tolerances as well as coatings, which should be accounted for in the actual profile of the airfoil. Accordingly, the values for the profile given are for a nominal airfoil. It will therefore be appreciated that +/− typical manufacturing tolerances, such as, +/−values, including any coating thicknesses, are additive to the X and Y values. Therefore, a distance of about +/−0.160 inches in a direction normal to any surface location along the airfoil profile defines an airfoil profile envelope for a rotor blade airfoil design and compressor. In other words, a distance of about +/−0.160 inches in a direction normal to any surface location along the airfoil profile defines a range of variation between measured points on the actual airfoil surface at nominal cold or room temperature and the ideal position of those points, at the same temperature, as embodied by the invention. The rotor blade airfoil design, as embodied by the invention, is robust to this range of variation without impairment of mechanical and aerodynamic functions.

The coordinate values given in TABLE 1S below provide the nominal profile envelope for an exemplary first stage stator.

TABLE 1S

| X-LOC | Y-LOC | Z-LOC | X-LOC | Y-LOC | Z-LOC | X-LOC | Y-LOC | Z-LOC |
|---|---|---|---|---|---|---|---|---|
| 2.601 | −0.040 | 0.000 | −1.467 | −0.071 | 0.000 | −0.865 | 0.148 | 0.000 |
| 2.601 | −0.042 | 0.000 | −1.579 | −0.021 | 0.000 | −0.725 | 0.123 | 0.000 |
| 2.601 | −0.046 | 0.000 | −1.686 | 0.028 | 0.000 | −0.579 | 0.100 | 0.000 |
| 2.598 | −0.053 | 0.000 | −1.782 | 0.076 | 0.000 | −0.434 | 0.080 | 0.000 |
| 2.587 | −0.060 | 0.000 | −1.868 | 0.122 | 0.000 | −0.287 | 0.062 | 0.000 |
| 2.565 | −0.066 | 0.000 | −1.944 | 0.165 | 0.000 | −0.141 | 0.047 | 0.000 |
| 2.535 | −0.075 | 0.000 | −2.010 | 0.204 | 0.000 | 0.006 | 0.034 | 0.000 |
| 2.496 | −0.086 | 0.000 | −2.066 | 0.240 | 0.000 | 0.153 | 0.023 | 0.000 |
| 2.466 | −0.100 | 0.000 | −2.114 | 0.271 | 0.000 | 0.300 | 0.012 | 0.000 |
| 2.382 | −0.117 | 0.000 | −2.153 | 0.299 | 0.000 | 0.447 | 0.002 | 0.000 |
| 2.307 | −0.137 | 0.000 | −2.185 | 0.324 | 0.000 | 0.594 | −0.007 | 0.000 |
| 2.227 | −0.157 | 0.000 | −2.211 | 0.346 | 0.000 | 0.741 | −0.017 | 0.000 |
| 2.138 | −0.181 | 0.000 | −2.230 | 0.364 | 0.000 | 0.888 | −0.025 | 0.000 |
| 2.038 | −0.206 | 0.000 | −2.244 | 0.380 | 0.000 | 1.035 | −0.033 | 0.000 |
| 1.928 | −0.232 | 0.000 | −2.253 | 0.392 | 0.000 | 1.178 | −0.039 | 0.000 |
| 1.813 | −0.259 | 0.000 | −2.259 | 0.404 | 0.000 | 1.315 | −0.045 | 0.000 |
| 1.692 | −0.285 | 0.000 | −2.261 | 0.414 | 0.000 | 1.448 | −0.049 | 0.000 |
| 1.566 | −0.311 | 0.000 | −2.260 | 0.422 | 0.000 | 1.575 | −0.052 | 0.000 |
| 1.435 | −0.336 | 0.000 | −2.255 | 0.427 | 0.000 | 1.698 | −0.054 | 0.000 |
| 1.298 | −0.359 | 0.000 | −2.247 | 0.432 | 0.000 | 1.816 | −0.054 | 0.000 |
| 1.156 | −0.381 | 0.000 | −2.235 | 0.435 | 0.000 | 1.929 | −0.053 | 0.000 |
| 1.008 | −0.401 | 0.000 | −2.220 | 0.437 | 0.000 | 2.038 | −0.051 | 0.000 |
| 0.855 | −0.418 | 0.000 | −2.200 | 0.437 | 0.000 | 2.136 | −0.049 | 0.000 |
| 0.702 | −0.431 | 0.000 | −2.175 | 0.434 | 0.000 | 2.225 | −0.046 | 0.000 |
| 0.548 | −0.440 | 0.000 | −2.143 | 0.430 | 0.000 | 2.303 | −0.042 | 0.000 |
| 0.394 | −0.445 | 0.000 | −2.105 | 0.423 | 0.000 | 2.377 | −0.038 | 0.000 |
| 0.240 | −0.445 | 0.000 | −2.060 | 0.413 | 0.000 | 2.441 | −0.034 | 0.000 |
| 0.086 | −0.439 | 0.000 | −2.007 | 0.402 | 0.000 | 2.490 | −0.030 | 0.000 |

TABLE 1S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.066 | −0.428 | 0.000 | −1.945 | 0.388 | 0.000 | 2.259 | −0.027 | 0.000 |
| −0.217 | −0.412 | 0.000 | −1.873 | 0.371 | 0.000 | 2.558 | −0.025 | 0.000 |
| −0.368 | −0.390 | 0.000 | −1.792 | 0.352 | 0.000 | 2.580 | −0.023 | 0.000 |
| −0.517 | −0.363 | 0.000 | −1.701 | 0.330 | 0.000 | 2.592 | −0.027 | 0.000 |
| −0.666 | −0.331 | 0.000 | −1.600 | 0.306 | 0.000 | 2.597 | −0.032 | 0.000 |
| −0.814 | −0.295 | 0.000 | −1.490 | 0.280 | 0.000 | 2.599 | −0.036 | 0.000 |
| −0.956 | −0.254 | 0.000 | −1.375 | 0.253 | 0.000 | 2.600 | −0.038 | 0.000 |
| −1.092 | −0.211 | 0.000 | −1.256 | 0.226 | 0.000 | 2.600 | −0.038 | 0.000 |
| −1.223 | −0.166 | 0.000 | −1.131 | 0.199 | 0.000 | | | |
| −1.348 | −0.119 | 0.000 | −1.000 | 0.173 | 0.000 | | | |
| 2.331 | 0.441 | 0.934 | −1.526 | 0.150 | 0.934 | −0.981 | 0.447 | 0.934 |
| 2.331 | 0.439 | 0.934 | −1.638 | 0.181 | 0.934 | −0.845 | 0.441 | 0.934 |
| 2.331 | 0.434 | 0.935 | −1.744 | 0.213 | 0.934 | −0.705 | 0.435 | 0.934 |
| 2.328 | 0.428 | 0.934 | −1.840 | 0.245 | 0.934 | −0.565 | 0.431 | 0.934 |
| 2.317 | 0.422 | 0.934 | −1.926 | 0.277 | 0.934 | −0.424 | 0.427 | 0.934 |
| 2.297 | 0.416 | 0.934 | −2.002 | 0.306 | 0.934 | −0.284 | 0.424 | 0.934 |
| 2.269 | 0.408 | 0.934 | −2.069 | 0.334 | 0.934 | −0.143 | 0.421 | 0.934 |
| 2.231 | 0.398 | 0.934 | −2.126 | 0.360 | 0.934 | −0.003 | 0.419 | 0.934 |
| 2.185 | 0.385 | 0.934 | −2.174 | 0.384 | 0.934 | 0.137 | 0.417 | 0.934 |
| 2.124 | 0.369 | 0.934 | −2.215 | 0.405 | 0.934 | 0.278 | 0.414 | 0.934 |
| 2.054 | 0.350 | 0.934 | −2.248 | 0.423 | 0.934 | 0.418 | 0.412 | 0.934 |
| 1.979 | 0.329 | 0.934 | −2.275 | 0.439 | 0.934 | 0.559 | 0.410 | 0.934 |
| 1.895 | 0.308 | 0.934 | −2.296 | 0.453 | 0.934 | 0.699 | 0.408 | 0.934 |
| 1.801 | 0.285 | 0.934 | −2.312 | 0.465 | 0.934 | 0.840 | 0.406 | 0.934 |
| 1.698 | 0.259 | 0.934 | −2.322 | 0.475 | 0.934 | 0.975 | 0.405 | 0.934 |
| 1.590 | 0.233 | 0.934 | −2.330 | 0.485 | 0.934 | 1.106 | 0.405 | 0.934 |
| 1.477 | 0.207 | 0.934 | −2.334 | 0.494 | 0.934 | 1.233 | 0.405 | 0.934 |
| 1.359 | 0.181 | 0.934 | −2.334 | 0.501 | 0.934 | 1.355 | 0.407 | 0.934 |
| 1.236 | 0.154 | 0.934 | −2.331 | 0.507 | 0.934 | 1.472 | 0.409 | 0.934 |
| 1.108 | 0.128 | 0.934 | −2.323 | 0.513 | 0.934 | 1.584 | 0.412 | 0.934 |
| 0.975 | 0.103 | 0.934 | −2.312 | 0.517 | 0.934 | 1.692 | 0.416 | 0.934 |
| 0.837 | 0.079 | 0.934 | −2.299 | 0.521 | 0.934 | 1.795 | 0.421 | 0.934 |
| 0.694 | 0.056 | 0.934 | −2.280 | 0.523 | 0.934 | 1.888 | 0.426 | 0.934 |
| 0.551 | 0.035 | 0.934 | −2.256 | 0.525 | 0.934 | 1.972 | 0.431 | 0.934 |
| 0.407 | 0.018 | 0.934 | −2.226 | 0.526 | 0.934 | 2.047 | 0.435 | 0.934 |
| 0.263 | 0.003 | 0.934 | −2.189 | 0.526 | 0.934 | 2.117 | 0.440 | 0.934 |
| 0.118 | −0.009 | 0.934 | −2.145 | 0.525 | 0.934 | 2.178 | 0.445 | 0.934 |
| −0.026 | −0.016 | 0.934 | −2.093 | 0.523 | 0.934 | 2.225 | 0.449 | 0.934 |
| −0.171 | −0.019 | 0.934 | −2.032 | 0.520 | 0.934 | 2.262 | 0.452 | 0.934 |
| −0.315 | −0.018 | 0.934 | −1.962 | 0.515 | 0.934 | 2.290 | 0.454 | 0.934 |
| −0.459 | −0.013 | 0.934 | −1.883 | 0.509 | 0.934 | 2.311 | 0.455 | 0.934 |
| −0.603 | −0.004 | 0.934 | −1.794 | 0.502 | 0.934 | 2.322 | 0.452 | 0.934 |
| −0.746 | 0.009 | 0.934 | −1.696 | 0.494 | 0.934 | 2.328 | 0.448 | 0.934 |
| −0.889 | 0.026 | 0.934 | −1.589 | 0.486 | 0.934 | 2.330 | 0.444 | 0.934 |
| −1.026 | 0.046 | 0.934 | −1.477 | 0.478 | 0.934 | 2.330 | 0.443 | 0.934 |
| −1.159 | 0.069 | 0.934 | −1.360 | 0.469 | 0.934 | 2.331 | 0.442 | 0.934 |
| −1.286 | 0.094 | 0.934 | −1.238 | 0.461 | 0.934 | | | |
| −1.409 | 0.121 | 0.934 | −1.112 | 0.454 | 0.934 | | | |
| 2.023 | 0.888 | 1.868 | −1.644 | 0.443 | 1.868 | −1.140 | 0.758 | 1.868 |
| 2.023 | 0.886 | 1.868 | −1.753 | 0.467 | 1.868 | −1.010 | 0.760 | 1.868 |
| 2.023 | 0.882 | 1.868 | −1.856 | 0.492 | 1.868 | −0.876 | 0.762 | 1.868 |
| 2.020 | 0.875 | 1.868 | −1.949 | 0.517 | 1.868 | −0.742 | 0.765 | 1.868 |
| 2.010 | 0.869 | 1.868 | −2.033 | 0.543 | 1.868 | −0.607 | 0.768 | 1.868 |
| 1.990 | 0.863 | 1.868 | −2.107 | 0.567 | 1.868 | −0.473 | 0.772 | 1.868 |
| 1.964 | 0.855 | 1.868 | −2.172 | 0.591 | 1.868 | −0.339 | 0.775 | 1.868 |
| 1.929 | 0.844 | 1.868 | −2.228 | 0.613 | 1.868 | −0.205 | 0.778 | 1.868 |
| 1.885 | 0.830 | 1.868 | −2.275 | 0.633 | 1.868 | −0.071 | 0.781 | 1.868 |
| 1.827 | 0.813 | 1.868 | −2.315 | 0.651 | 1.868 | 0.064 | 0.784 | 1.868 |
| 1.761 | 0.792 | 1.868 | −2.348 | 0.667 | 1.868 | 0.198 | 0.786 | 1.868 |
| 1.691 | 0.770 | 1.868 | −2.374 | 0.681 | 1.868 | 0.332 | 0.789 | 1.868 |
| 1.611 | 0.747 | 1.868 | −2.395 | 0.694 | 1.868 | 0.466 | 0.793 | 1.868 |
| 1.522 | 0.722 | 1.868 | −2.410 | 0.704 | 1.868 | 0.600 | 0.797 | 1.868 |
| 1.424 | 0.694 | 1.868 | −2.421 | 0.713 | 1.868 | 0.730 | 0.801 | 1.868 |
| 1.322 | 0.666 | 1.868 | −2.429 | 0.722 | 1.868 | 0.855 | 0.806 | 1.868 |
| 1.215 | 0.637 | 1.868 | −2.433 | 0.730 | 1.868 | 0.976 | 0.812 | 1.868 |
| 1.104 | 0.607 | 1.868 | −2.434 | 0.737 | 1.868 | 1.092 | 0.818 | 1.868 |
| 0.988 | 0.577 | 1.868 | −2.431 | 0.743 | 1.868 | 1.204 | 0.825 | 1.868 |
| 0.867 | 0.547 | 1.868 | −2.424 | 0.749 | 1.868 | 1.311 | 0.832 | 1.868 |
| 0.741 | 0.518 | 1.868 | −2.414 | 0.753 | 1.868 | 1.413 | 0.841 | 1.868 |
| 0.610 | 0.489 | 1.868 | −2.401 | 0.757 | 1.868 | 1.512 | 0.849 | 1.868 |
| 0.474 | 0.462 | 1.868 | −2.383 | 0.760 | 1.868 | 1.601 | 0.858 | 1.868 |
| 0.338 | 0.437 | 1.868 | −2.360 | 0.763 | 1.868 | 1.681 | 0.867 | 1.868 |
| 0.202 | 0.414 | 1.868 | −2.331 | 0.766 | 1.868 | 1.752 | 0.873 | 1.868 |
| 0.065 | 0.395 | 1.868 | −2.296 | 0.767 | 1.868 | 1.819 | 0.880 | 1.868 |
| −0.073 | 0.378 | 1.868 | −2.254 | 0.769 | 1.868 | 1.877 | 0.886 | 1.868 |
| −0.210 | 0.365 | 1.868 | −2.205 | 0.769 | 1.868 | 1.921 | 0.892 | 1.868 |
| −0.347 | 0.355 | 1.868 | −2.147 | 0.769 | 1.868 | 1.957 | 0.896 | 1.868 |

TABLE 1S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.483 | 0.349 | 1.868 | −2.079 | 0.769 | 1.868 | 1.984 | 0.899 | 1.868 |
| −0.620 | 0.346 | 1.868 | −2.003 | 0.767 | 1.868 | 2.004 | 0.901 | 1.868 |
| −0.757 | 0.347 | 1.868 | −1.918 | 0.765 | 1.868 | 2.014 | 0.899 | 1.868 |
| −0.894 | 0.352 | 1.868 | −1.824 | 0.763 | 1.868 | 2.020 | 0.894 | 1.868 |
| −1.030 | 0.360 | 1.868 | −1.722 | 0.761 | 1.868 | 2.022 | 0.891 | 1.868 |
| −1.162 | 0.371 | 1.868 | −1.614 | 0.760 | 1.868 | 2.022 | 0.889 | 1.868 |
| −1.290 | 0.385 | 1.868 | −1.502 | 0.758 | 1.868 | 2.022 | 0.888 | 1.868 |
| −1.413 | 0.402 | 1.868 | −1.386 | 0.758 | 1.868 | | | |
| −1.531 | 0.422 | 1.868 | −1.265 | 0.758 | 1.868 | | | |
| 1.756 | 1.216 | 2.803 | −1.768 | 0.714 | 2.803 | −1.290 | 1.026 | 2.803 |
| 1.756 | 1.215 | 2.803 | −1.873 | 0.733 | 2.803 | −1.165 | 1.030 | 2.803 |
| 1.756 | 1.211 | 2.803 | −1.973 | 0.755 | 2.803 | −1.036 | 1.035 | 2.803 |
| 1.753 | 1.204 | 2.803 | −2.064 | 0.776 | 2.803 | −0.906 | 1.040 | 2.803 |
| 1.744 | 1.198 | 2.803 | −2.145 | 0.798 | 2.803 | −0.777 | 1.046 | 2.803 |
| 1.725 | 1.192 | 2.803 | −2.218 | 0.820 | 2.803 | −0.648 | 1.052 | 2.803 |
| 1.700 | 1.184 | 2.803 | −2.281 | 0.841 | 2.803 | −0.518 | 1.058 | 2.803 |
| 1.666 | 1.173 | 2.803 | −2.336 | 0.860 | 2.803 | −0.389 | 1.063 | 2.803 |
| 1.624 | 1.159 | 2.803 | −2.381 | 0.878 | 2.803 | −0.260 | 1.069 | 2.803 |
| 1.569 | 1.141 | 2.803 | −2.420 | 0.894 | 2.803 | −0.130 | 1.074 | 2.803 |
| 1.505 | 1.121 | 2.803 | −2.452 | 0.909 | 2.803 | −0.001 | 1.079 | 2.803 |
| 1.438 | 1.099 | 2.803 | −2.478 | 0.922 | 2.803 | 0.128 | 1.085 | 2.803 |
| 1.361 | 1.076 | 2.803 | −2.499 | 0.933 | 2.803 | 0.258 | 1.091 | 2.803 |
| 1.276 | 1.050 | 2.803 | −2.514 | 0.943 | 2.803 | 0.387 | 1.098 | 2.803 |
| 1.182 | 1.022 | 2.803 | −2.524 | 0.951 | 2.803 | 0.512 | 1.105 | 2.803 |
| 1.084 | 0.992 | 2.803 | −2.532 | 0.959 | 2.803 | 0.633 | 1.113 | 2.803 |
| 0.982 | 0.962 | 2.803 | −2.537 | 0.967 | 2.803 | 0.749 | 1.121 | 2.803 |
| 0.875 | 0.931 | 2.803 | −2.537 | 0.973 | 2.803 | 0.861 | 1.130 | 2.803 |
| 0.764 | 0.900 | 2.803 | −2.534 | 0.979 | 2.803 | 0.968 | 1.139 | 2.803 |
| 0.648 | 0.869 | 2.803 | −2.528 | 0.985 | 2.803 | 1.071 | 1.149 | 2.803 |
| 0.527 | 0.839 | 2.803 | −2.518 | 0.989 | 2.803 | 1.170 | 1.160 | 2.803 |
| 0.402 | 0.809 | 2.803 | −2.506 | 0.993 | 2.803 | 1.264 | 1.170 | 2.803 |
| 0.272 | 0.780 | 2.803 | −2.489 | 0.997 | 2.803 | 1.350 | 1.181 | 2.803 |
| 0.141 | 0.753 | 2.803 | −2.467 | 1.000 | 2.803 | 1.427 | 1.190 | 2.803 |
| 0.010 | 0.729 | 2.803 | −2.439 | 1.003 | 2.803 | 1.496 | 1.199 | 2.803 |
| −0.121 | 0.707 | 2.803 | −2.405 | 1.006 | 2.803 | 1.560 | 1.206 | 2.803 |
| −0.253 | 0.688 | 2.803 | −2.364 | 1.008 | 2.803 | 1.616 | 1.213 | 2.803 |
| −0.385 | 0.672 | 2.803 | −2.317 | 1.010 | 2.803 | 1.659 | 1.219 | 2.803 |
| −0.516 | 0.660 | 2.803 | −2.261 | 1.012 | 2.803 | 1.693 | 1.224 | 2.803 |
| −0.648 | 0.651 | 2.803 | −2.196 | 1.013 | 2.803 | 1.719 | 1.228 | 2.803 |
| −0.780 | 0.646 | 2.803 | −2.123 | 1.014 | 2.803 | 1.738 | 1.230 | 2.803 |
| −0.912 | 0.644 | 2.803 | −2.041 | 1.014 | 2.803 | 1.748 | 1.228 | 2.803 |
| −1.043 | 0.645 | 2.803 | −1.950 | 1.015 | 2.803 | 1.753 | 1.223 | 2.803 |
| −1.175 | 0.649 | 2.803 | −1.851 | 1.015 | 2.803 | 1.755 | 1.220 | 2.803 |
| −1.302 | 0.657 | 2.803 | −1.747 | 1.016 | 2.803 | 1.755 | 1.218 | 2.803 |
| −1.425 | 0.667 | 2.803 | −1.640 | 1.018 | 2.803 | 1.756 | 1.217 | 2.803 |
| −1.544 | 0.681 | 2.803 | −1.527 | 1.020 | 2.803 | | | |
| −1.658 | 0.696 | 2.803 | −1.411 | 1.023 | 2.803 | | | |
| 1.527 | 1.443 | 3.737 | −1.864 | 0.914 | 3.737 | −1.408 | 1.216 | 3.737 |
| 1.527 | 1.441 | 3.737 | −1.966 | 0.932 | 3.737 | −1.287 | 1.221 | 3.737 |
| 1.527 | 1.438 | 3.737 | −2.063 | 0.950 | 3.737 | −1.162 | 1.227 | 3.737 |
| 1.524 | 1.431 | 3.737 | −2.150 | 0.970 | 3.737 | −1.038 | 1.234 | 3.737 |
| 1.516 | 1.424 | 3.737 | −2.229 | 0.990 | 3.737 | −0.913 | 1.240 | 3.737 |
| 1.498 | 1.418 | 3.737 | −2.299 | 1.009 | 3.737 | −0.788 | 1.248 | 3.737 |
| 1.473 | 1.410 | 3.737 | −2.361 | 1.028 | 3.737 | −0.664 | 1.255 | 3.737 |
| 1.441 | 1.400 | 3.737 | −2.414 | 1.046 | 3.737 | −0.539 | 1.262 | 3.737 |
| 1.400 | 1.386 | 3.737 | −2.458 | 1.062 | 3.737 | −0.414 | 1.269 | 3.737 |
| 1.347 | 1.368 | 3.737 | −2.496 | 1.077 | 3.737 | −0.290 | 1.276 | 3.737 |
| 1.286 | 1.348 | 3.737 | −2.527 | 1.091 | 3.737 | −0.165 | 1.283 | 3.737 |
| 1.221 | 1.327 | 3.737 | −2.552 | 1.102 | 3.737 | −0.040 | 1.291 | 3.737 |
| 1.148 | 1.303 | 3.737 | −2.572 | 1.113 | 3.737 | 0.084 | 1.299 | 3.737 |
| 1.066 | 1.278 | 3.737 | −2.587 | 1.122 | 3.737 | 0.209 | 1.308 | 3.737 |
| 0.976 | 1.249 | 3.737 | −2.597 | 1.130 | 3.737 | 0.329 | 1.317 | 3.737 |
| 0.882 | 1.220 | 3.737 | −2.605 | 1.137 | 3.737 | 0.445 | 1.327 | 3.737 |
| 0.783 | 1.190 | 3.737 | −2.609 | 1.145 | 3.737 | 0.557 | 1.337 | 3.737 |
| 0.681 | 1.159 | 3.737 | −2.610 | 1.151 | 3.737 | 0.665 | 1.347 | 3.737 |
| 0.574 | 1.128 | 3.737 | −2.607 | 1.157 | 3.737 | 0.768 | 1.358 | 3.737 |
| 0.462 | 1.097 | 3.737 | −2.601 | 1.162 | 3.737 | 0.868 | 1.369 | 3.737 |
| 0.346 | 1.066 | 3.737 | −2.592 | 1.167 | 3.737 | 0.963 | 1.380 | 3.737 |
| 0.226 | 1.035 | 3.737 | −2.580 | 1.171 | 3.737 | 1.054 | 1.392 | 3.737 |
| 0.101 | 1.006 | 3.737 | −2.564 | 1.175 | 3.737 | 1.136 | 1.403 | 3.737 |
| −0.025 | 0.978 | 3.737 | −2.542 | 1.178 | 3.737 | 1.210 | 1.414 | 3.737 |
| −0.151 | 0.953 | 3.737 | −2.515 | 1.181 | 3.737 | 1.276 | 1.423 | 3.737 |
| −0.277 | 0.930 | 3.737 | −2.483 | 1.184 | 3.737 | 1.338 | 1.431 | 3.737 |
| −0.404 | 0.910 | 3.737 | −2.444 | 1.186 | 3.737 | 1.392 | 1.439 | 3.737 |
| −0.531 | 0.893 | 3.737 | −2.398 | 1.189 | 3.737 | 1.433 | 1.445 | 3.737 |
| −0.658 | 0.879 | 3.737 | −2.344 | 1.191 | 3.737 | 1.466 | 1.450 | 3.737 |
| −0.784 | 0.869 | 3.737 | −2.281 | 1.193 | 3.737 | 1.491 | 1.454 | 3.737 |

TABLE 1S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.911 | 0.862 | 3.737 | −2.211 | 1.195 | 3.737 | 1.509 | 1.457 | 3.737 |
| −1.038 | 0.859 | 3.737 | −2.132 | 1.196 | 3.737 | 1.519 | 1.454 | 3.737 |
| −1.165 | 0.858 | 3.737 | −2.044 | 1.198 | 3.737 | 1.524 | 1.449 | 3.737 |
| −1.292 | 0.861 | 3.737 | −1.949 | 1.199 | 3.737 | 1.526 | 1.446 | 3.737 |
| −1.415 | 0.866 | 3.737 | −1.849 | 1.202 | 3.737 | 1.526 | 1.445 | 3.737 |
| −1.534 | 0.875 | 3.737 | −1.745 | 1.204 | 3.737 | 1.526 | 1.444 | 3.737 |
| −1.648 | 0.886 | 3.737 | −1.636 | 1.207 | 3.737 | | | |
| −1.758 | 0.899 | 3.737 | −1.524 | 1.211 | 3.737 | | | |
| 1.339 | 1.596 | 4.671 | −1.939 | 1.069 | 4.671 | −1.498 | 1.355 | 4.671 |
| 1.339 | 1.595 | 4.671 | −2.037 | 1.085 | 4.671 | −1.381 | 1.360 | 4.671 |
| 1.339 | 1.591 | 4.671 | −2.130 | 1.102 | 4.671 | −1.260 | 1.366 | 4.671 |
| 1.337 | 1.585 | 4.671 | −2.215 | 1.120 | 4.671 | −1.140 | 1.373 | 4.671 |
| 1.330 | 1.578 | 4.671 | −2.291 | 1.138 | 4.671 | −1.019 | 1.381 | 4.671 |
| 1.312 | 1.572 | 4.671 | −2.359 | 1.156 | 4.671 | −0.898 | 1.388 | 4.671 |
| 1.289 | 1.564 | 4.671 | −2.419 | 1.173 | 4.671 | −0.778 | 1.396 | 4.671 |
| 1.257 | 1.554 | 4.671 | −2.470 | 1.189 | 4.671 | −0.657 | 1.404 | 4.671 |
| 1.218 | 1.541 | 4.671 | −2.513 | 1.205 | 4.671 | −0.537 | 1.411 | 4.671 |
| 1.167 | 1.524 | 4.671 | −2.550 | 1.218 | 4.671 | −0.416 | 1.419 | 4.671 |
| 1.108 | 1.504 | 4.671 | −2.580 | 1.231 | 4.671 | −0.296 | 1.428 | 4.671 |
| 1.045 | 1.484 | 4.671 | −2.605 | 1.242 | 4.671 | −0.175 | 1.436 | 4.671 |
| 0.974 | 1.461 | 4.671 | −2.624 | 1.252 | 4.671 | −0.055 | 1.446 | 4.671 |
| 0.895 | 1.436 | 4.671 | −2.638 | 1.260 | 4.671 | 0.066 | 1.455 | 4.671 |
| 0.808 | 1.408 | 4.671 | −2.648 | 1.268 | 4.671 | 0.182 | 1.465 | 4.671 |
| 0.717 | 1.380 | 4.671 | −2.656 | 1.275 | 4.671 | 0.294 | 1.476 | 4.671 |
| 0.622 | 1.351 | 4.671 | −2.660 | 1.282 | 4.671 | 0.402 | 1.487 | 4.671 |
| 0.523 | 1.321 | 4.671 | −2.661 | 1.288 | 4.671 | 0.507 | 1.498 | 4.671 |
| 0.420 | 1.290 | 4.671 | −2.658 | 1.294 | 4.671 | 0.607 | 1.509 | 4.671 |
| 0.312 | 1.260 | 4.671 | −2.652 | 1.299 | 4.671 | 0.703 | 1.520 | 4.671 |
| 0.201 | 1.229 | 4.671 | −2.643 | 1.304 | 4.671 | 0.795 | 1.532 | 4.671 |
| 0.084 | 1.199 | 4.671 | −2.632 | 1.307 | 4.671 | 0.882 | 1.544 | 4.671 |
| −0.036 | 1.170 | 4.671 | −2.616 | 1.311 | 4.671 | 0.962 | 1.556 | 4.671 |
| −0.157 | 1.143 | 4.671 | −2.595 | 1.314 | 4.671 | 1.034 | 1.566 | 4.671 |
| −0.279 | 1.118 | 4.671 | −2.569 | 1.317 | 4.671 | 1.098 | 1.576 | 4.671 |
| −0.401 | 1.095 | 4.671 | −2.538 | 1.320 | 4.671 | 1.158 | 1.584 | 4.671 |
| −0.524 | 1.075 | 4.671 | −2.500 | 1.323 | 4.671 | 1.209 | 1.592 | 4.671 |
| −0.646 | 1.058 | 4.671 | −2.456 | 1.325 | 4.671 | 1.249 | 1.599 | 4.671 |
| −0.769 | 1.044 | 4.671 | −2.403 | 1.327 | 4.671 | 1.281 | 1.604 | 4.671 |
| −0.892 | 1.034 | 4.671 | −2.343 | 1.330 | 4.671 | 1.305 | 1.608 | 4.671 |
| −1.015 | 1.026 | 4.671 | −2.275 | 1.331 | 4.671 | 1.323 | 1.610 | 4.671 |
| −1.138 | 1.022 | 4.671 | −2.198 | 1.333 | 4.671 | 1.332 | 1.607 | 4.671 |
| −1.261 | 1.020 | 4.671 | −2.113 | 1.335 | 4.671 | 1.337 | 1.602 | 4.671 |
| −1.384 | 1.022 | 4.671 | −2.021 | 1.337 | 4.671 | 1.338 | 1.600 | 4.671 |
| −1.503 | 1.027 | 4.671 | −1.924 | 1.339 | 4.671 | 1.339 | 1.598 | 4.671 |
| −1.618 | 1.034 | 4.671 | −1.824 | 1.342 | 4.671 | 1.339 | 1.597 | 4.671 |
| −1.729 | 1.043 | 4.671 | −1.719 | 1.346 | 4.671 | | | |
| −1.836 | 1.055 | 4.671 | −1.610 | 1.350 | 4.671 | | | |
| 1.198 | 1.702 | 5.605 | −1.981 | 1.181 | 5.605 | −1.556 | 1.451 | 5.605 |
| 1.198 | 1.700 | 5.605 | −2.077 | 1.195 | 5.605 | −1.443 | 1.456 | 5.605 |
| 1.198 | 1.697 | 5.605 | −2.168 | 1.211 | 5.605 | −1.326 | 1.463 | 5.605 |
| 1.196 | 1.691 | 5.605 | −2.250 | 1.228 | 5.605 | −1.208 | 1.470 | 5.605 |
| 1.190 | 1.684 | 5.605 | −2.325 | 1.244 | 5.605 | −1.091 | 1.477 | 5.605 |
| 1.173 | 1.677 | 5.605 | −2.391 | 1.261 | 5.605 | −0.974 | 1.485 | 5.605 |
| 1.150 | 1.670 | 5.605 | −2.449 | 1.277 | 5.605 | −0.857 | 1.493 | 5.605 |
| 1.119 | 1.660 | 5.605 | −2.499 | 1.293 | 5.605 | −0.740 | 1.501 | 5.605 |
| 1.081 | 1.647 | 5.605 | −2.542 | 1.307 | 5.605 | −0.623 | 1.509 | 5.605 |
| 1.031 | 1.631 | 5.605 | −2.577 | 1.320 | 5.605 | −0.506 | 1.518 | 5.605 |
| 0.974 | 1.612 | 5.605 | −2.607 | 1.331 | 5.605 | −0.389 | 1.526 | 5.605 |
| 0.913 | 1.592 | 5.605 | −2.631 | 1.342 | 5.605 | −0.272 | 1.536 | 5.605 |
| 0.844 | 1.570 | 5.605 | −2.650 | 1.351 | 5.605 | −0.155 | 1.546 | 5.605 |
| 0.767 | 1.546 | 5.605 | −2.664 | 1.359 | 5.605 | −0.038 | 1.556 | 5.605 |
| 0.683 | 1.519 | 5.605 | −2.674 | 1.366 | 5.605 | 0.075 | 1.567 | 5.605 |
| 0.595 | 1.491 | 5.605 | −2.681 | 1.373 | 5.605 | 0.184 | 1.578 | 5.605 |
| 0.502 | 1.463 | 5.605 | −2.685 | 1.380 | 5.605 | 0.289 | 1.589 | 5.605 |
| 0.406 | 1.434 | 5.605 | −2.686 | 1.386 | 5.605 | 0.390 | 1.600 | 5.605 |
| 0.306 | 1.404 | 5.605 | −2.684 | 1.391 | 5.605 | 0.487 | 1.612 | 5.605 |
| 0.202 | 1.374 | 5.605 | −2.678 | 1.397 | 5.605 | 0.580 | 1.624 | 5.605 |
| 0.093 | 1.345 | 5.605 | −2.669 | 1.401 | 5.605 | 0.669 | 1.636 | 5.605 |
| −0.020 | 1.316 | 5.605 | −2.658 | 1.405 | 5.605 | 0.755 | 1.648 | 5.605 |
| −0.137 | 1.287 | 5.605 | −2.643 | 1.408 | 5.605 | 0.832 | 1.660 | 5.605 |
| −0.255 | 1.261 | 5.605 | −2.623 | 1.411 | 5.605 | 0.902 | 1.671 | 5.605 |
| −0.373 | 1.236 | 5.605 | −2.597 | 1.414 | 5.605 | 0.964 | 1.680 | 5.605 |
| −0.491 | 1.214 | 5.605 | −2.567 | 1.417 | 5.605 | 1.022 | 1.690 | 5.605 |
| −0.609 | 1.194 | 5.605 | −2.530 | 1.419 | 5.605 | 1.072 | 1.698 | 5.605 |
| −0.728 | 1.178 | 5.605 | −2.487 | 1.421 | 5.605 | 1.111 | 1.704 | 5.605 |
| −0.846 | 1.164 | 5.605 | −2.436 | 1.424 | 5.605 | 1.141 | 1.709 | 5.605 |
| −0.965 | 1.153 | 5.605 | −2.377 | 1.426 | 5.605 | 1.165 | 1.713 | 5.605 |
| −1.084 | 1.145 | 5.605 | −2.311 | 1.427 | 5.605 | 1.182 | 1.716 | 5.605 |

TABLE 1S-continued

| X-LOC | Y-LOC | Z-LOC | X-LOC | Y-LOC | Z-LOC | X-LOC | Y-LOC | Z-LOC |
|---|---|---|---|---|---|---|---|---|
| −1.203 | 1.141 | 5.605 | −2.237 | 1.429 | 5.605 | 1.191 | 1.712 | 5.605 |
| −1.323 | 1.139 | 5.605 | −2.154 | 1.431 | 5.605 | 1.195 | 1.708 | 5.605 |
| −1.442 | 1.140 | 5.605 | −2.064 | 1.433 | 5.605 | 1.197 | 1.705 | 5.605 |
| −1.558 | 1.143 | 5.605 | −1.971 | 1.435 | 5.605 | 1.197 | 1.703 | 5.605 |
| −1.669 | 1.149 | 5.605 | −1.873 | 1.438 | 5.605 | 1.197 | 1.702 | 5.605 |
| −1.777 | 1.158 | 5.605 | −1.771 | 1.442 | 5.605 | | | |
| −1.881 | 1.169 | 5.605 | −1.666 | 1.446 | 5.605 | | | |
| 1.106 | 1.751 | 6.540 | −1.993 | 1.248 | 6.540 | −1.579 | 1.499 | 6.540 |
| 1.106 | 1.749 | 6.540 | −2.086 | 1.261 | 6.540 | −1.469 | 1.504 | 6.540 |
| 1.106 | 1.746 | 6.540 | −2.175 | 1.276 | 6.540 | −1.354 | 1.510 | 6.540 |
| 1.105 | 1.740 | 6.540 | −2.256 | 1.292 | 6.540 | −1.240 | 1.517 | 6.540 |
| 1.098 | 1.733 | 6.540 | −2.329 | 1.307 | 6.540 | −1.126 | 1.524 | 6.540 |
| 1.082 | 1.726 | 6.540 | −2.393 | 1.323 | 6.540 | −1.012 | 1.531 | 6.540 |
| 1.060 | 1.719 | 6.540 | −2.450 | 1.338 | 6.540 | −0.897 | 1.539 | 6.540 |
| 1.030 | 1.709 | 6.540 | −2.499 | 1.353 | 6.540 | −0.783 | 1.547 | 6.540 |
| 0.993 | 1.697 | 6.540 | −2.540 | 1.366 | 6.540 | −0.669 | 1.555 | 6.540 |
| 0.944 | 1.681 | 6.540 | −2.575 | 1.379 | 6.540 | −0.555 | 1.564 | 6.540 |
| 0.888 | 1.663 | 6.540 | −2.604 | 1.389 | 6.540 | −0.440 | 1.572 | 6.540 |
| 0.829 | 1.643 | 6.540 | −2.628 | 1.399 | 6.540 | −0.326 | 1.582 | 6.540 |
| 0.761 | 1.622 | 6.540 | −2.646 | 1.408 | 6.540 | −0.212 | 1.592 | 6.540 |
| 0.687 | 1.598 | 6.540 | −2.660 | 1.416 | 6.540 | −0.098 | 1.602 | 6.540 |
| 0.604 | 1.573 | 6.540 | −2.670 | 1.423 | 6.540 | 0.012 | 1.613 | 6.540 |
| 0.518 | 1.546 | 6.540 | −2.677 | 1.429 | 6.540 | 0.118 | 1.624 | 6.540 |
| 0.428 | 1.518 | 6.540 | −2.681 | 1.436 | 6.540 | 0.220 | 1.636 | 6.540 |
| 0.334 | 1.490 | 6.540 | −2.682 | 1.442 | 6.540 | 0.319 | 1.648 | 6.540 |
| 0.237 | 1.462 | 6.540 | −2.680 | 1.447 | 6.540 | 0.414 | 1.660 | 6.540 |
| 0.135 | 1.433 | 6.540 | −2.674 | 1.452 | 6.540 | 0.504 | 1.672 | 6.540 |
| 0.029 | 1.405 | 6.540 | −2.665 | 1.456 | 6.540 | 0.591 | 1.684 | 6.540 |
| −0.081 | 1.377 | 6.540 | −2.655 | 1.460 | 6.540 | 0.674 | 1.697 | 6.540 |
| −0.196 | 1.349 | 6.540 | −2.640 | 1.463 | 6.540 | 0.750 | 1.708 | 6.540 |
| −0.311 | 1.324 | 6.540 | −2.620 | 1.466 | 6.540 | 0.818 | 1.719 | 6.540 |
| −0.426 | 1.301 | 6.540 | −2.595 | 1.468 | 6.540 | 0.878 | 1.729 | 6.540 |
| −0.541 | 1.280 | 6.540 | −2.565 | 1.471 | 6.540 | 0.935 | 1.739 | 6.540 |
| −0.656 | 1.261 | 6.540 | −2.529 | 1.473 | 6.540 | 0.984 | 1.747 | 6.540 |
| −0.772 | 1.245 | 6.540 | −2.487 | 1.475 | 6.540 | 1.021 | 1.753 | 6.540 |
| −0.888 | 1.232 | 6.540 | −2.438 | 1.477 | 6.540 | 1.051 | 1.758 | 6.540 |
| −1.003 | 1.221 | 6.540 | −2.381 | 1.478 | 6.540 | 1.074 | 1.762 | 6.540 |
| −1.119 | 1.214 | 6.540 | −2.316 | 1.480 | 6.540 | 1.091 | 1.765 | 6.540 |
| −1.235 | 1.209 | 6.540 | −2.243 | 1.481 | 6.540 | 1.100 | 1.761 | 6.540 |
| −1.352 | 1.208 | 6.540 | −2.163 | 1.482 | 6.540 | 1.104 | 1.756 | 6.540 |
| −1.468 | 1.208 | 6.540 | −2.075 | 1.484 | 6.540 | 1.105 | 1.754 | 6.540 |
| −1.581 | 1.212 | 6.540 | −1.984 | 1.486 | 6.540 | 1.105 | 1.752 | 6.540 |
| −1.689 | 1.218 | 6.540 | −1.888 | 1.488 | 6.540 | 1.106 | 1.751 | 6.540 |
| −1.794 | 1.226 | 6.540 | −1.789 | 1.491 | 6.540 | | | |
| −1.896 | 1.236 | 6.540 | −1.686 | 1.495 | 6.540 | | | |
| 1.055 | 1.708 | 8.408 | −1.928 | 1.260 | 8.408 | −1.529 | 1.472 | 8.408 |
| 1.055 | 1.707 | 8.408 | −2.017 | 1.273 | 8.408 | −1.423 | 1.476 | 8.408 |
| 1.055 | 1.704 | 8.408 | −2.103 | 1.288 | 8.408 | −1.313 | 1.479 | 8.408 |
| 1.054 | 1.698 | 8.408 | −2.180 | 1.302 | 8.408 | −1.202 | 1.484 | 8.408 |
| 1.048 | 1.690 | 8.408 | −2.251 | 1.317 | 8.408 | −1.092 | 1.489 | 8.408 |
| 1.033 | 1.684 | 8.408 | −2.313 | 1.331 | 8.408 | −0.982 | 1.495 | 8.408 |
| 1.011 | 1.677 | 8.408 | −2.368 | 1.345 | 8.408 | −0.872 | 1.501 | 8.408 |
| 0.983 | 1.667 | 8.408 | −2.415 | 1.359 | 8.408 | −0.762 | 1.508 | 8.408 |
| 0.947 | 1.656 | 8.408 | −2.455 | 1.371 | 8.408 | −0.652 | 1.515 | 8.408 |
| 0.900 | 1.641 | 8.408 | −2.488 | 1.382 | 8.408 | −0.542 | 1.522 | 8.408 |
| 0.846 | 1.624 | 8.408 | −2.516 | 1.392 | 8.408 | −0.432 | 1.530 | 8.408 |
| 0.789 | 1.606 | 8.408 | −2.539 | 1.401 | 8.408 | −0.322 | 1.539 | 8.408 |
| 0.724 | 1.586 | 8.408 | −2.557 | 1.409 | 8.408 | −0.212 | 1.548 | 8.408 |
| 0.652 | 1.564 | 8.408 | −2.571 | 1.417 | 8.408 | −0.103 | 1.558 | 8.408 |
| 0.572 | 1.540 | 8.408 | −2.580 | 1.423 | 8.408 | 0.003 | 1.569 | 8.408 |
| 0.489 | 1.515 | 8.408 | −2.587 | 1.429 | 8.408 | 0.105 | 1.580 | 8.408 |
| 0.403 | 1.489 | 8.408 | −2.592 | 1.435 | 8.408 | 0.204 | 1.592 | 8.408 |
| 0.312 | 1.463 | 8.408 | −2.592 | 1.441 | 8.408 | 0.299 | 1.603 | 8.408 |
| 0.218 | 1.437 | 8.408 | −2.590 | 1.446 | 8.408 | 0.390 | 1.615 | 8.408 |
| 0.119 | 1.411 | 8.408 | −2.584 | 1.450 | 8.408 | 0.477 | 1.628 | 8.408 |
| 0.017 | 1.386 | 8.408 | −2.576 | 1.454 | 8.408 | 0.561 | 1.640 | 8.408 |
| −0.089 | 1.360 | 8.408 | −2.565 | 1.457 | 8.408 | 0.641 | 1.653 | 8.408 |
| −0.200 | 1.336 | 8.408 | −2.551 | 1.460 | 8.408 | 0.713 | 1.665 | 8.408 |
| −0.310 | 1.314 | 8.408 | −2.532 | 1.462 | 8.408 | 0.779 | 1.676 | 8.408 |
| −0.421 | 1.293 | 8.408 | −2.508 | 1.464 | 8.408 | 0.837 | 1.686 | 8.408 |
| −0.532 | 1.275 | 8.408 | −2.479 | 1.465 | 8.408 | 0.891 | 1.695 | 8.408 |
| −0.644 | 1.259 | 8.408 | −2.444 | 1.466 | 8.408 | 0.938 | 1.704 | 8.408 |
| −0.755 | 1.245 | 8.408 | −2.404 | 1.467 | 8.408 | 0.974 | 1.711 | 8.408 |
| −0.866 | 1.234 | 8.408 | −2.356 | 1.468 | 8.408 | 1.003 | 1.717 | 8.408 |
| −0.978 | 1.226 | 8.408 | −2.301 | 1.468 | 8.408 | 1.025 | 1.721 | 8.408 |
| −1.089 | 1.221 | 8.408 | −2.239 | 1.468 | 8.408 | 1.041 | 1.722 | 8.408 |
| −1.201 | 1.218 | 8.408 | −2.169 | 1.467 | 8.408 | 1.049 | 1.718 | 8.408 |

TABLE 1S-continued

| X-LOC | Y-LOC | Z-LOC | X-LOC | Y-LOC | Z-LOC | X-LOC | Y-LOC | Z-LOC |
|---|---|---|---|---|---|---|---|---|
| −1.312 | 1.217 | 8.408 | −2.092 | 1.467 | 8.408 | 1.053 | 1.714 | 8.408 |
| −1.424 | 1.219 | 8.408 | −2.007 | 1.467 | 8.408 | 1.054 | 1.711 | 8.408 |
| −1.532 | 1.224 | 8.408 | −1.919 | 1.467 | 8.408 | 1.055 | 1.710 | 8.408 |
| −1.637 | 1.230 | 8.408 | −1.827 | 1.468 | 8.408 | 1.055 | 1.709 | 8.408 |
| −1.737 | 1.238 | 8.408 | −1.731 | 1.469 | 8.408 | | | |
| −1.834 | 1.248 | 8.408 | −1.632 | 1.470 | 8.408 | | | |
| 1.225 | 1.352 | 11.211 | −1.647 | 1.038 | 11.211 | −1.260 | 1.182 | 11.211 |
| 1.226 | 1.351 | 11.211 | −1.732 | 1.053 | 11.211 | −1.158 | 1.180 | 11.211 |
| 1.226 | 1.348 | 11.211 | −1.813 | 1.069 | 11.211 | −1.052 | 1.178 | 11.211 |
| 1.225 | 1.342 | 11.211 | −1.888 | 1.085 | 11.211 | −0.946 | 1.177 | 11.211 |
| 1.220 | 1.335 | 11.211 | −1.955 | 1.100 | 11.211 | −0.840 | 1.177 | 11.211 |
| 1.205 | 1.328 | 11.211 | −2.014 | 1.115 | 11.211 | −0.734 | 1.177 | 11.211 |
| 1.184 | 1.322 | 11.211 | −2.066 | 1.129 | 11.211 | −0.628 | 1.179 | 11.211 |
| 1.157 | 1.313 | 11.211 | −2.111 | 1.142 | 11.211 | −0.522 | 1.181 | 11.211 |
| 1.122 | 1.303 | 11.211 | −2.149 | 1.154 | 11.211 | −0.416 | 1.184 | 11.211 |
| 1.077 | 1.289 | 11.211 | −2.182 | 1.165 | 11.211 | −0.310 | 1.188 | 11.211 |
| 1.025 | 1.274 | 11.211 | −2.209 | 1.174 | 11.211 | −0.204 | 1.193 | 11.211 |
| 0.970 | 1.258 | 11.211 | −2.231 | 1.182 | 11.211 | −0.099 | 1.199 | 11.211 |
| 0.907 | 1.240 | 11.211 | −2.248 | 1.190 | 11.211 | 0.007 | 1.206 | 11.211 |
| 0.837 | 1.220 | 11.211 | −2.261 | 1.196 | 11.211 | 0.112 | 1.213 | 11.211 |
| 0.761 | 1.200 | 11.211 | −2.270 | 1.202 | 11.211 | 0.214 | 1.222 | 11.211 |
| 0.680 | 1.179 | 11.211 | −2.277 | 1.208 | 11.211 | 0.313 | 1.231 | 11.211 |
| 0.596 | 1.157 | 11.211 | −2.281 | 1.214 | 11.211 | 0.408 | 1.241 | 11.211 |
| 0.509 | 1.136 | 11.211 | −2.282 | 1.219 | 11.211 | 0.499 | 1.252 | 11.211 |
| 0.417 | 1.115 | 11.211 | −2.280 | 1.224 | 11.211 | 0.586 | 1.262 | 11.211 |
| 0.322 | 1.094 | 11.211 | −2.274 | 1.228 | 11.211 | 0.671 | 1.274 | 11.211 |
| 0.223 | 1.073 | 11.211 | −2.265 | 1.230 | 11.211 | 0.751 | 1.286 | 11.211 |
| 0.120 | 1.054 | 11.211 | −2.255 | 1.232 | 11.211 | 0.828 | 1.298 | 11.211 |
| 0.013 | 1.036 | 11.211 | −2.241 | 1.234 | 11.211 | 0.898 | 1.309 | 11.211 |
| −0.094 | 1.019 | 11.211 | −2.222 | 1.234 | 11.211 | 0.960 | 1.320 | 11.211 |
| −0.202 | 1.005 | 11.211 | −2.199 | 1.234 | 11.211 | 1.016 | 1.330 | 11.211 |
| −0.309 | 0.993 | 11.211 | −2.172 | 1.233 | 11.211 | 1.068 | 1.340 | 11.211 |
| −0.417 | 0.983 | 11.211 | −2.138 | 1.232 | 11.211 | 1.113 | 1.349 | 11.211 |
| −0.524 | 0.976 | 11.211 | −2.100 | 1.230 | 11.211 | 1.148 | 1.356 | 11.211 |
| −0.631 | 0.971 | 11.211 | −2.054 | 1.227 | 11.211 | 1.176 | 1.361 | 11.211 |
| −0.739 | 0.968 | 11.211 | −2.001 | 1.224 | 11.211 | 1.197 | 1.365 | 11.211 |
| −0.846 | 0.968 | 11.211 | −1.941 | 1.219 | 11.211 | 1.212 | 1.367 | 11.211 |
| −0.953 | 0.970 | 11.211 | −1.874 | 1.215 | 11.211 | 1.220 | 1.362 | 11.211 |
| −1.060 | 0.974 | 11.211 | −1.800 | 1.210 | 11.211 | 1.223 | 1.358 | 11.211 |
| −1.167 | 0.981 | 11.211 | −1.719 | 1.204 | 11.211 | 1.225 | 1.355 | 11.211 |
| −1.270 | 0.989 | 11.211 | −1.634 | 1.199 | 11.211 | 1.225 | 1.354 | 11.211 |
| −1.370 | 0.999 | 11.211 | −1.546 | 1.194 | 11.211 | 1.225 | 1.353 | 11.211 |
| −1.466 | 1.011 | 11.211 | −1.454 | 1.190 | 11.211 | | | |
| −1.558 | 1.024 | 11.211 | −1.359 | 1.186 | 11.211 | | | |
| 1.644 | 0.600 | 14.948 | −1.137 | 0.577 | 14.948 | −0.757 | 0.637 | 14.948 |
| 1.645 | 0.598 | 14.948 | −1.217 | 0.602 | 14.948 | −0.659 | 0.621 | 14.948 |
| 1.645 | 0.596 | 14.948 | −1.293 | 0.627 | 14.948 | −0.558 | 0.607 | 14.948 |
| 1.644 | 0.590 | 14.948 | −1.363 | 0.651 | 14.948 | −0.457 | 0.593 | 14.948 |
| 1.639 | 0.583 | 14.948 | −1.425 | 0.674 | 14.948 | −0.355 | 0.581 | 14.948 |
| 1.626 | 0.576 | 14.948 | −1.481 | 0.695 | 14.948 | −0.253 | 0.570 | 14.948 |
| 1.605 | 0.570 | 14.948 | −1.530 | 0.715 | 14.948 | −0.151 | 0.560 | 14.948 |
| 1.578 | 0.563 | 14.948 | −1.572 | 0.732 | 14.948 | −0.049 | 0.552 | 14.948 |
| 1.544 | 0.554 | 14.948 | −1.607 | 0.747 | 14.948 | 0.053 | 0.544 | 14.948 |
| 1.500 | 0.543 | 14.948 | −1.637 | 0.761 | 14.948 | 0.155 | 0.538 | 14.948 |
| 1.450 | 0.530 | 14.948 | −1.662 | 0.773 | 14.948 | 0.257 | 0.532 | 14.948 |
| 1.395 | 0.517 | 14.948 | −1.682 | 0.783 | 14.948 | 0.359 | 0.529 | 14.948 |
| 1.334 | 0.503 | 14.948 | −1.698 | 0.792 | 14.948 | 0.461 | 0.526 | 14.948 |
| 1.265 | 0.488 | 14.948 | −1.710 | 0.799 | 14.948 | 0.564 | 0.525 | 14.948 |
| 1.190 | 0.473 | 14.948 | −1.719 | 0.805 | 14.948 | 0.662 | 0.525 | 14.948 |
| 1.111 | 0.458 | 14.948 | −1.725 | 0.811 | 14.948 | 0.758 | 0.527 | 14.948 |
| 1.029 | 0.444 | 14.948 | −1.730 | 0.817 | 14.948 | 0.850 | 0.530 | 14.948 |
| 0.943 | 0.430 | 14.948 | −1.730 | 0.822 | 14.948 | 0.938 | 0.534 | 14.948 |
| 0.853 | 0.417 | 14.948 | −1.727 | 0.826 | 14.948 | 1.023 | 0.539 | 14.948 |
| 0.760 | 0.406 | 14.948 | −1.720 | 0.828 | 14.948 | 1.105 | 0.546 | 14.948 |
| 0.664 | 0.395 | 14.948 | −1.712 | 0.828 | 14.948 | 1.184 | 0.553 | 14.948 |
| 0.564 | 0.387 | 14.948 | −1.701 | 0.828 | 14.948 | 1.258 | 0.561 | 14.948 |
| 0.460 | 0.380 | 14.948 | −1.688 | 0.826 | 14.948 | 1.326 | 0.569 | 14.948 |
| 0.357 | 0.376 | 14.948 | −1.670 | 0.823 | 14.948 | 1.388 | 0.577 | 14.948 |
| 0.253 | 0.374 | 14.948 | −1.648 | 0.819 | 14.948 | 1.442 | 0.585 | 14.948 |
| 0.149 | 0.374 | 14.948 | −1.622 | 0.814 | 14.948 | 1.492 | 0.593 | 14.948 |
| 0.046 | 0.377 | 14.948 | −1.591 | 0.807 | 14.948 | 1.536 | 0.600 | 14.948 |
| −0.058 | 0.382 | 14.948 | −1.554 | 0.799 | 14.948 | 1.570 | 0.606 | 14.948 |
| −0.162 | 0.390 | 14.948 | −1.511 | 0.789 | 14.948 | 1.597 | 0.611 | 14.948 |
| −0.266 | 0.400 | 14.948 | −1.461 | 0.778 | 14.948 | 1.617 | 0.615 | 14.948 |
| −0.370 | 0.413 | 14.948 | −1.404 | 0.765 | 14.948 | 1.633 | 0.614 | 14.948 |
| −0.474 | 0.427 | 14.948 | −1.341 | 0.750 | 14.948 | 1.640 | 0.610 | 14.948 |
| −0.578 | 0.445 | 14.948 | −1.271 | 0.735 | 14.948 | 1.643 | 0.605 | 14.948 |

TABLE 1S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.681 | 0.464 | 14.948 | −1.194 | 0.718 | 14.948 | 1.644 | 0.602 | 14.948 |
| −0.780 | 0.484 | 14.948 | −1.113 | 0.702 | 14.948 | 1.644 | 0.601 | 14.948 |
| −0.875 | 0.506 | 14.948 | −1.030 | 0.685 | 14.948 | 1.644 | 0.601 | 14.948 |
| −0.966 | 0.529 | 14.948 | −0.942 | 0.669 | 14.948 | | | |
| −1.053 | 0.553 | 14.948 | −0.852 | 0.653 | 14.948 | | | |

The coordinate values given in TABLE 2S below provide the nominal profile envelope for an exemplary second stage stator.

TABLE 2S

| X-LOC | Y-LOC | Z-LOC | X-LOC | Y-LOC | Z-LOC | X-LOC | Y-LOC | Z-LOC |
|---|---|---|---|---|---|---|---|---|
| 2.562 | 0.006 | 0.000 | −1.473 | −0.086 | 0.000 | −0.868 | 0.205 | 0.000 |
| 2.562 | 0.004 | 0.000 | −1.586 | −0.043 | 0.000 | −0.729 | 0.187 | 0.000 |
| 2.562 | 0.000 | 0.000 | −1.693 | 0.001 | 0.000 | −0.584 | 0.170 | 0.000 |
| 2.559 | −0.008 | 0.000 | −1.790 | 0.044 | 0.000 | −0.439 | 0.154 | 0.000 |
| 2.550 | −0.017 | 0.000 | −1.876 | 0.086 | 0.000 | −0.293 | 0.139 | 0.000 |
| 2.528 | −0.023 | 0.000 | −1.953 | 0.126 | 0.000 | −0.148 | 0.125 | 0.000 |
| 2.499 | −0.030 | 0.000 | −2.019 | 0.163 | 0.000 | −0.003 | 0.112 | 0.000 |
| 2.459 | −0.039 | 0.000 | −2.076 | 0.197 | 0.000 | 0.143 | 0.100 | 0.000 |
| 2.410 | −0.051 | 0.000 | −2.122 | 0.228 | 0.000 | 0.288 | 0.088 | 0.000 |
| 2.346 | −0.066 | 0.000 | −2.161 | 0.255 | 0.000 | 0.433 | 0.076 | 0.000 |
| 2.272 | −0.083 | 0.000 | −2.193 | 0.280 | 0.000 | 0.579 | 0.065 | 0.000 |
| 2.193 | −0.101 | 0.000 | −2.218 | 0.302 | 0.000 | 0.724 | 0.056 | 0.000 |
| 2.104 | −0.121 | 0.000 | −2.237 | 0.321 | 0.000 | 0.870 | 0.047 | 0.000 |
| 2.005 | −0.143 | 0.000 | −2.250 | 0.336 | 0.000 | 1.016 | 0.039 | 0.000 |
| 1.897 | −0.166 | 0.000 | −2.259 | 0.348 | 0.000 | 1.156 | 0.033 | 0.000 |
| 1.783 | −0.190 | 0.000 | −2.265 | 0.360 | 0.000 | 1.293 | 0.028 | 0.000 |
| 1.664 | −0.215 | 0.000 | −2.266 | 0.370 | 0.000 | 1.424 | 0.024 | 0.000 |
| 1.540 | −0.240 | 0.000 | −2.265 | 0.378 | 0.000 | 1.550 | 0.020 | 0.000 |
| 1.411 | −0.264 | 0.000 | −2.261 | 0.383 | 0.000 | 1.672 | 0.018 | 0.000 |
| 1.276 | −0.288 | 0.000 | −2.252 | 0.388 | 0.000 | 1.789 | 0.017 | 0.000 |
| 1.136 | −0.311 | 0.000 | −2.240 | 0.391 | 0.000 | 1.901 | 0.016 | 0.000 |
| 0.991 | −0.332 | 0.000 | −2.226 | 0.393 | 0.000 | 2.008 | 0.017 | 0.000 |
| 0.841 | −0.351 | 0.000 | −2.206 | 0.394 | 0.000 | 2.105 | 0.018 | 0.000 |
| 0.690 | −0.366 | 0.000 | −2.181 | 0.395 | 0.000 | 2.193 | 0.019 | 0.000 |
| 0.539 | −0.378 | 0.000 | −2.149 | 0.395 | 0.000 | 2.270 | 0.020 | 0.000 |
| 0.388 | −0.385 | 0.000 | −2.111 | 0.393 | 0.000 | 2.343 | 0.022 | 0.000 |
| 0.236 | −0.387 | 0.000 | −2.066 | 0.389 | 0.000 | 2.407 | 0.023 | 0.000 |
| 0.085 | −0.385 | 0.000 | −2.012 | 0.383 | 0.000 | 2.455 | 0.025 | 0.000 |
| −0.067 | −0.378 | 0.000 | −1.950 | 0.374 | 0.000 | 2.494 | 0.026 | 0.000 |
| −0.218 | −0.366 | 0.000 | −1.877 | 0.363 | 0.000 | 2.524 | 0.027 | 0.000 |
| −0.369 | −0.349 | 0.000 | −1.796 | 0.350 | 0.000 | 2.545 | 0.026 | 0.000 |
| −0.520 | −0.328 | 0.000 | −1.705 | 0.335 | 0.000 | 2.555 | 0.020 | 0.000 |
| −0.670 | −0.302 | 0.000 | −1.604 | 0.318 | 0.000 | 2.560 | 0.013 | 0.000 |
| −0.818 | −0.273 | 0.000 | −1.494 | 0.300 | 0.000 | 2.561 | 0.010 | 0.000 |
| −0.962 | −0.240 | 0.000 | −1.378 | 0.281 | 0.000 | 2.562 | 0.008 | 0.000 |
| −1.099 | −0.205 | 0.000 | −1.258 | 0.262 | 0.000 | 2.562 | 0.007 | 0.000 |
| −1.230 | −0.167 | 0.000 | −1.133 | 0.242 | 0.000 | | | |
| −1.354 | −0.127 | 0.000 | −1.003 | 0.223 | 0.000 | | | |
| 2.457 | 0.262 | 0.823 | −1.495 | 0.092 | 0.823 | −0.914 | 0.422 | 0.823 |
| 2.457 | 0.260 | 0.823 | −1.608 | 0.127 | 0.823 | −0.776 | 0.411 | 0.823 |
| 2.457 | 0.256 | 0.823 | −1.715 | 0.163 | 0.823 | −0.634 | 0.401 | 0.823 |
| 2.455 | 0.248 | 0.823 | −1.811 | 0.199 | 0.823 | −0.491 | 0.392 | 0.823 |
| 2.445 | 0.240 | 0.823 | −1.898 | 0.234 | 0.823 | −0.348 | 0.384 | 0.823 |
| 2.424 | 0.235 | 0.823 | −1.975 | 0.268 | 0.823 | −0.205 | 0.376 | 0.823 |
| 2.395 | 0.229 | 0.823 | −2.042 | 0.300 | 0.823 | −0.062 | 0.368 | 0.823 |
| 2.356 | 0.221 | 0.823 | −2.099 | 0.330 | 0.823 | 0.081 | 0.360 | 0.823 |
| 2.308 | 0.211 | 0.823 | −2.146 | 0.357 | 0.823 | 0.224 | 0.351 | 0.823 |
| 2.245 | 0.198 | 0.823 | −2.185 | 0.382 | 0.823 | 0.367 | 0.343 | 0.823 |
| 2.173 | 0.183 | 0.823 | −2.217 | 0.404 | 0.823 | 0.510 | 0.334 | 0.823 |
| 2.095 | 0.168 | 0.823 | −2.243 | 0.424 | 0.823 | 0.654 | 0.327 | 0.823 |
| 2.008 | 0.151 | 0.823 | −2.263 | 0.441 | 0.823 | 0.797 | 0.319 | 0.823 |
| 1.911 | 0.132 | 0.823 | −2.277 | 0.455 | 0.823 | 0.940 | 0.312 | 0.823 |
| 1.805 | 0.111 | 0.823 | −2.286 | 0.467 | 0.823 | 1.078 | 0.306 | 0.823 |
| 1.693 | 0.090 | 0.823 | −2.292 | 0.478 | 0.823 | 1.212 | 0.301 | 0.823 |
| 1.577 | 0.068 | 0.823 | −2.294 | 0.487 | 0.823 | 1.340 | 0.296 | 0.823 |
| 1.456 | 0.045 | 0.823 | −2.293 | 0.495 | 0.823 | 1.464 | 0.292 | 0.823 |
| 1.330 | 0.023 | 0.823 | −2.290 | 0.501 | 0.823 | 1.584 | 0.289 | 0.823 |
| 1.198 | 0.000 | 0.823 | −2.282 | 0.506 | 0.823 | 1.698 | 0.286 | 0.823 |
| 1.062 | −0.021 | 0.823 | −2.270 | 0.510 | 0.823 | 1.808 | 0.285 | 0.823 |

TABLE 2S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.920 | −0.042 | 0.823 | −2.256 | 0.513 | 0.823 | 1.913 | 0.284 | 0.823 |
| 0.774 | −0.062 | 0.823 | −2.237 | 0.516 | 0.823 | 2.009 | 0.283 | 0.823 |
| 0.627 | −0.079 | 0.823 | −2.213 | 0.519 | 0.823 | 2.095 | 0.283 | 0.823 |
| 0.480 | −0.093 | 0.823 | −2.182 | 0.521 | 0.823 | 2.171 | 0.283 | 0.823 |
| 0.332 | −0.104 | 0.823 | −2.144 | 0.521 | 0.823 | 2.243 | 0.283 | 0.823 |
| 0.184 | −0.112 | 0.823 | −2.099 | 0.521 | 0.823 | 2.305 | 0.283 | 0.823 |
| 0.036 | −0.116 | 0.823 | −2.047 | 0.519 | 0.823 | 2.353 | 0.283 | 0.823 |
| −0.111 | −0.115 | 0.823 | −1.985 | 0.515 | 0.823 | 2.391 | 0.283 | 0.823 |
| −0.259 | −0.110 | 0.823 | −1.913 | 0.510 | 0.823 | 2.420 | 0.283 | 0.823 |
| −0.407 | −0.101 | 0.823 | −1.832 | 0.503 | 0.823 | 2.441 | 0.282 | 0.823 |
| −0.554 | −0.088 | 0.823 | −1.742 | 0.495 | 0.823 | 2.451 | 0.276 | 0.823 |
| −0.701 | −0.071 | 0.823 | −1.642 | 0.485 | 0.823 | 2.455 | 0.269 | 0.823 |
| −0.848 | −0.051 | 0.823 | −1.533 | 0.475 | 0.823 | 2.457 | 0.266 | 0.823 |
| −0.989 | −0.027 | 0.823 | −1.419 | 0.465 | 0.823 | 2.457 | 0.264 | 0.823 |
| −1.124 | −0.001 | 0.823 | −1.300 | 0.454 | 0.823 | 2.457 | 0.263 | 0.823 |
| −1.254 | 0.028 | 0.823 | −1.176 | 0.443 | 0.823 | | | |
| −1.377 | 0.059 | 0.823 | −1.048 | 0.432 | 0.823 | | | |
| 2.346 | 0.516 | 1.646 | −1.504 | 0.255 | 1.646 | −0.948 | 0.595 | 1.646 |
| 2.346 | 0.514 | 1.646 | −1.614 | 0.285 | 1.646 | −0.813 | 0.589 | 1.646 |
| 2.346 | 0.510 | 1.646 | −1.720 | 0.317 | 1.646 | −0.673 | 0.583 | 1.646 |
| 2.344 | 0.503 | 1.646 | −1.815 | 0.350 | 1.646 | −0.533 | 0.578 | 1.646 |
| 2.335 | 0.494 | 1.646 | −1.901 | 0.381 | 1.646 | −0.394 | 0.573 | 1.646 |
| 2.314 | 0.489 | 1.646 | −1.977 | 0.412 | 1.646 | −0.254 | 0.569 | 1.646 |
| 2.286 | 0.482 | 1.646 | −2.043 | 0.441 | 1.646 | −0.114 | 0.564 | 1.646 |
| 2.249 | 0.474 | 1.646 | −2.100 | 0.468 | 1.646 | 0.026 | 0.559 | 1.646 |
| 2.202 | 0.463 | 1.646 | −2.147 | 0.493 | 1.646 | 0.165 | 0.553 | 1.646 |
| 2.141 | 0.449 | 1.646 | −2.186 | 0.515 | 1.646 | 0.305 | 0.548 | 1.646 |
| 2.071 | 0.433 | 1.646 | −2.218 | 0.536 | 1.646 | 0.445 | 0.543 | 1.646 |
| 1.995 | 0.416 | 1.646 | −2.244 | 0.554 | 1.646 | 0.585 | 0.538 | 1.646 |
| 1.911 | 0.397 | 1.646 | −2.263 | 0.570 | 1.646 | 0.724 | 0.534 | 1.646 |
| 1.817 | 0.377 | 1.646 | −2.278 | 0.583 | 1.646 | 0.864 | 0.530 | 1.646 |
| 1.713 | 0.354 | 1.646 | −2.287 | 0.594 | 1.646 | 0.999 | 0.527 | 1.646 |
| 1.605 | 0.331 | 1.646 | −2.293 | 0.605 | 1.646 | 1.130 | 0.525 | 1.646 |
| 1.492 | 0.307 | 1.646 | −2.296 | 0.614 | 1.646 | 1.256 | 0.523 | 1.646 |
| 1.375 | 0.282 | 1.646 | −2.295 | 0.622 | 1.646 | 1.377 | 0.522 | 1.646 |
| 1.252 | 0.257 | 1.646 | −2.292 | 0.628 | 1.646 | 1.493 | 0.522 | 1.646 |
| 1.125 | 0.232 | 1.646 | −2.284 | 0.633 | 1.646 | 1.605 | 0.522 | 1.646 |
| 0.992 | 0.208 | 1.646 | −2.273 | 0.637 | 1.646 | 1.713 | 0.523 | 1.646 |
| 0.855 | 0.184 | 1.646 | −2.260 | 0.641 | 1.646 | 1.815 | 0.525 | 1.646 |
| 0.712 | 0.162 | 1.646 | −2.242 | 0.645 | 1.646 | 1.909 | 0.527 | 1.646 |
| 0.569 | 0.142 | 1.646 | −2.218 | 0.649 | 1.646 | 1.992 | 0.528 | 1.646 |
| 0.426 | 0.125 | 1.646 | −2.188 | 0.652 | 1.646 | 2.067 | 0.530 | 1.646 |
| 0.282 | 0.111 | 1.646 | −2.151 | 0.654 | 1.646 | 2.137 | 0.532 | 1.646 |
| 0.138 | 0.099 | 1.646 | −2.107 | 0.655 | 1.646 | 2.198 | 0.533 | 1.646 |
| −0.006 | 0.092 | 1.646 | −2.056 | 0.655 | 1.646 | 2.244 | 0.535 | 1.646 |
| −0.150 | 0.089 | 1.646 | −1.995 | 0.654 | 1.646 | 2.281 | 0.536 | 1.646 |
| −0.294 | 0.090 | 1.646 | −1.925 | 0.651 | 1.646 | 2.309 | 0.537 | 1.646 |
| −0.438 | 0.095 | 1.646 | −1.846 | 0.647 | 1.646 | 2.330 | 0.536 | 1.646 |
| −0.582 | 0.104 | 1.646 | −1.758 | 0.642 | 1.646 | 2.340 | 0.530 | 1.646 |
| −0.726 | 0.116 | 1.646 | −1.660 | 0.636 | 1.646 | 2.344 | 0.523 | 1.646 |
| −0.869 | 0.133 | 1.646 | −1.553 | 0.630 | 1.646 | 2.345 | 0.520 | 1.646 |
| −1.007 | 0.152 | 1.646 | −1.441 | 0.623 | 1.646 | 2.346 | 0.518 | 1.646 |
| −1.140 | 0.174 | 1.646 | −1.325 | 0.616 | 1.646 | 2.346 | 0.517 | 1.646 |
| −1.267 | 0.199 | 1.646 | −1.204 | 0.609 | 1.646 | | | |
| −1.388 | 0.226 | 1.646 | −1.078 | 0.602 | 1.646 | | | |
| 2.173 | 0.806 | 3.292 | −1.507 | 0.509 | 3.292 | −0.985 | 0.825 | 3.292 |
| 2.173 | 0.804 | 3.292 | −1.614 | 0.535 | 3.292 | −0.855 | 0.821 | 3.292 |
| 2.173 | 0.801 | 3.292 | −1.715 | 0.564 | 3.292 | −0.721 | 0.818 | 3.292 |
| 2.171 | 0.794 | 3.292 | −1.808 | 0.592 | 3.292 | −0.587 | 0.815 | 3.292 |
| 2.164 | 0.785 | 3.292 | −1.891 | 0.619 | 3.292 | −0.453 | 0.813 | 3.292 |
| 2.144 | 0.779 | 3.292 | −1.964 | 0.646 | 3.292 | −0.319 | 0.811 | 3.292 |
| 2.117 | 0.773 | 3.292 | −2.029 | 0.672 | 3.292 | −0.185 | 0.808 | 3.292 |
| 2.082 | 0.764 | 3.292 | −2.084 | 0.696 | 3.292 | −0.051 | 0.806 | 3.292 |
| 2.037 | 0.753 | 3.292 | −2.130 | 0.717 | 3.292 | 0.083 | 0.803 | 3.292 |
| 1.979 | 0.740 | 3.292 | −2.168 | 0.737 | 3.292 | 0.217 | 0.801 | 3.292 |
| 1.911 | 0.724 | 3.292 | −2.200 | 0.756 | 3.292 | 0.351 | 0.799 | 3.292 |
| 1.840 | 0.708 | 3.292 | −2.225 | 0.772 | 3.292 | 0.485 | 0.797 | 3.292 |
| 1.759 | 0.689 | 3.292 | −2.245 | 0.786 | 3.292 | 0.619 | 0.795 | 3.292 |
| 1.669 | 0.669 | 3.292 | −2.259 | 0.798 | 3.292 | 0.753 | 0.794 | 3.292 |
| 1.570 | 0.647 | 3.292 | −2.268 | 0.808 | 3.292 | 0.883 | 0.794 | 3.292 |
| 1.467 | 0.624 | 3.292 | −2.275 | 0.818 | 3.292 | 1.008 | 0.794 | 3.292 |
| 1.359 | 0.600 | 3.292 | −2.277 | 0.827 | 3.292 | 1.129 | 0.795 | 3.292 |
| 1.246 | 0.576 | 3.292 | −2.277 | 0.834 | 3.292 | 1.245 | 0.796 | 3.292 |
| 1.129 | 0.552 | 3.292 | −2.274 | 0.840 | 3.292 | 1.357 | 0.797 | 3.292 |
| 1.008 | 0.528 | 3.292 | −2.267 | 0.845 | 3.292 | 1.464 | 0.800 | 3.292 |
| 0.881 | 0.503 | 3.292 | −2.256 | 0.849 | 3.292 | 1.567 | 0.803 | 3.292 |
| 0.750 | 0.480 | 3.292 | −2.243 | 0.853 | 3.292 | 1.665 | 0.806 | 3.292 |

TABLE 2S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.613 | 0.457 | 3.292 | −2.226 | 0.857 | 3.292 | 1.754 | 0.809 | 3.292 |
| 0.477 | 0.437 | 3.292 | −2.203 | 0.860 | 3.292 | 1.835 | 0.812 | 3.292 |
| 0.340 | 0.419 | 3.292 | −2.174 | 0.863 | 3.292 | 1.906 | 0.815 | 3.292 |
| 0.203 | 0.404 | 3.292 | −2.139 | 0.865 | 3.292 | 1.973 | 0.818 | 3.292 |
| 0.065 | 0.392 | 3.292 | −2.097 | 0.866 | 3.292 | 2.031 | 0.821 | 3.292 |
| −0.072 | 0.383 | 3.292 | −2.047 | 0.866 | 3.292 | 2.076 | 0.823 | 3.292 |
| −0.210 | 0.377 | 3.292 | −1.989 | 0.866 | 3.292 | 2.112 | 0.825 | 3.292 |
| −0.348 | 0.376 | 3.292 | −1.922 | 0.864 | 3.292 | 2.138 | 0.826 | 3.292 |
| −0.486 | 0.378 | 3.292 | −1.846 | 0.861 | 3.292 | 2.158 | 0.825 | 3.292 |
| −0.624 | 0.384 | 3.292 | −1.762 | 0.857 | 3.292 | 2.167 | 0.819 | 3.292 |
| −0.762 | 0.394 | 3.292 | −1.668 | 0.853 | 3.292 | 2.171 | 0.813 | 3.292 |
| −0.899 | 0.407 | 3.292 | −1.565 | 0.849 | 3.292 | 2.173 | 0.810 | 3.292 |
| −1.031 | 0.422 | 3.292 | −1.458 | 0.844 | 3.292 | 2.173 | 0.808 | 3.292 |
| −1.158 | 0.441 | 3.292 | −1.346 | 0.839 | 3.292 | 2.173 | 0.807 | 3.292 |
| −1.279 | 0.461 | 3.292 | −1.230 | 0.834 | 3.292 | | | |
| −1.396 | 0.484 | 3.292 | −1.110 | 0.829 | 3.292 | | | |
| 2.029 | 0.920 | 4.938 | −1.470 | 0.641 | 4.938 | −0.977 | 0.900 | 4.938 |
| 2.029 | 0.918 | 4.938 | −1.571 | 0.665 | 4.938 | −0.853 | 0.897 | 4.938 |
| 2.029 | 0.915 | 4.938 | −1.668 | 0.690 | 4.938 | −0.726 | 0.893 | 4.938 |
| 2.027 | 0.908 | 4.938 | −1.756 | 0.715 | 4.938 | −0.598 | 0.891 | 4.938 |
| 2.021 | 0.900 | 4.938 | −1.835 | 0.740 | 4.938 | −0.470 | 0.889 | 4.938 |
| 2.002 | 0.894 | 4.938 | −1.905 | 0.764 | 4.938 | −0.343 | 0.888 | 4.938 |
| 1.977 | 0.888 | 4.938 | −1.967 | 0.787 | 4.938 | −0.215 | 0.886 | 4.938 |
| 1.943 | 0.880 | 4.938 | −2.020 | 0.808 | 4.938 | −0.088 | 0.885 | 4.938 |
| 1.900 | 0.870 | 4.938 | −2.064 | 0.827 | 4.938 | 0.040 | 0.884 | 4.938 |
| 1.845 | 0.857 | 4.938 | −2.101 | 0.845 | 4.938 | 0.168 | 0.884 | 4.938 |
| 1.781 | 0.843 | 4.938 | −2.132 | 0.861 | 4.938 | 0.295 | 0.883 | 4.938 |
| 1.713 | 0.828 | 4.938 | −2.156 | 0.875 | 4.938 | 0.423 | 0.883 | 4.938 |
| 1.636 | 0.811 | 4.938 | −2.176 | 0.888 | 4.938 | 0.551 | 0.884 | 4.938 |
| 1.550 | 0.792 | 4.938 | −2.189 | 0.898 | 4.938 | 0.678 | 0.885 | 4.938 |
| 1.456 | 0.772 | 4.938 | −2.199 | 0.908 | 4.938 | 0.802 | 0.887 | 4.938 |
| 1.358 | 0.751 | 4.938 | −2.205 | 0.917 | 4.938 | 0.921 | 0.889 | 4.938 |
| 1.256 | 0.729 | 4.938 | −2.208 | 0.925 | 4.938 | 1.036 | 0.892 | 4.938 |
| 1.149 | 0.707 | 4.938 | −2.208 | 0.932 | 4.938 | 1.146 | 0.895 | 4.938 |
| 1.037 | 0.685 | 4.938 | −2.205 | 0.937 | 4.938 | 1.253 | 0.899 | 4.938 |
| 0.921 | 0.663 | 4.938 | −2.198 | 0.942 | 4.938 | 1.355 | 0.903 | 4.938 |
| 0.801 | 0.640 | 4.938 | −2.188 | 0.945 | 4.938 | 1.452 | 0.907 | 4.938 |
| 0.676 | 0.619 | 4.938 | −2.175 | 0.948 | 4.938 | 1.546 | 0.912 | 4.938 |
| 0.547 | 0.598 | 4.938 | −2.158 | 0.951 | 4.938 | 1.631 | 0.917 | 4.938 |
| 0.417 | 0.580 | 4.938 | −2.136 | 0.953 | 4.938 | 1.707 | 0.921 | 4.938 |
| 0.287 | 0.563 | 4.938 | −2.109 | 0.954 | 4.938 | 1.775 | 0.925 | 4.938 |
| 0.157 | 0.549 | 4.938 | −2.075 | 0.955 | 4.938 | 1.839 | 0.929 | 4.938 |
| 0.026 | 0.538 | 4.938 | −2.035 | 0.954 | 4.938 | 1.894 | 0.932 | 4.938 |
| −0.104 | 0.529 | 4.938 | −1.988 | 0.953 | 4.938 | 1.937 | 0.935 | 4.938 |
| −0.235 | 0.524 | 4.938 | −1.933 | 0.951 | 4.938 | 1.971 | 0.938 | 4.938 |
| −0.365 | 0.522 | 4.938 | −1.869 | 0.948 | 4.938 | 1.996 | 0.940 | 4.938 |
| −0.496 | 0.524 | 4.938 | −1.797 | 0.943 | 4.938 | 2.015 | 0.939 | 4.938 |
| −0.627 | 0.529 | 4.938 | −1.716 | 0.938 | 4.938 | 2.024 | 0.932 | 4.938 |
| −0.758 | 0.537 | 4.938 | −1.627 | 0.933 | 4.938 | 2.027 | 0.927 | 4.938 |
| −0.888 | 0.548 | 4.938 | −1.529 | 0.927 | 4.938 | 2.029 | 0.923 | 4.938 |
| −1.014 | 0.562 | 4.938 | −1.427 | 0.921 | 4.938 | 2.029 | 0.922 | 4.938 |
| −1.136 | 0.579 | 4.938 | −1.321 | 0.916 | 4.938 | 2.029 | 0.921 | 4.938 |
| −1.252 | 0.597 | 4.938 | −1.211 | 0.910 | 4.938 | | | |
| −1.363 | 0.618 | 4.938 | −1.096 | 0.905 | 4.938 | | | |
| 1.979 | 0.859 | 6.584 | −1.334 | 0.627 | 6.584 | −0.870 | 0.825 | 6.584 |
| 1.980 | 0.857 | 6.584 | −1.430 | 0.649 | 6.584 | −0.753 | 0.819 | 6.584 |
| 1.979 | 0.853 | 6.584 | −1.522 | 0.673 | 6.584 | −0.632 | 0.814 | 6.584 |
| 1.978 | 0.847 | 6.584 | −1.605 | 0.696 | 6.584 | −0.511 | 0.810 | 6.584 |
| 1.971 | 0.839 | 6.584 | −1.680 | 0.719 | 6.584 | −0.390 | 0.807 | 6.584 |
| 1.954 | 0.833 | 6.584 | −1.747 | 0.740 | 6.584 | −0.269 | 0.805 | 6.584 |
| 1.929 | 0.828 | 6.584 | −1.806 | 0.761 | 6.584 | −0.148 | 0.803 | 6.584 |
| 1.897 | 0.820 | 6.584 | −1.856 | 0.780 | 6.584 | −0.027 | 0.801 | 6.584 |
| 1.857 | 0.812 | 6.584 | −1.898 | 0.797 | 6.584 | 0.094 | 0.801 | 6.584 |
| 1.804 | 0.800 | 6.584 | −1.934 | 0.813 | 6.584 | 0.215 | 0.800 | 6.584 |
| 1.744 | 0.787 | 6.584 | −1.963 | 0.827 | 6.584 | 0.336 | 0.801 | 6.584 |
| 1.679 | 0.774 | 6.584 | −1.987 | 0.840 | 6.584 | 0.457 | 0.802 | 6.584 |
| 1.606 | 0.759 | 6.584 | −2.005 | 0.851 | 6.584 | 0.578 | 0.804 | 6.584 |
| 1.525 | 0.742 | 6.584 | −2.019 | 0.861 | 6.584 | 0.699 | 0.806 | 6.584 |
| 1.436 | 0.724 | 6.584 | −2.028 | 0.869 | 6.584 | 0.816 | 0.810 | 6.584 |
| 1.343 | 0.705 | 6.584 | −2.034 | 0.877 | 6.584 | 0.929 | 0.813 | 6.584 |
| 1.246 | 0.686 | 6.584 | −2.037 | 0.885 | 6.584 | 1.038 | 0.818 | 6.584 |
| 1.145 | 0.666 | 6.584 | −2.037 | 0.891 | 6.584 | 1.143 | 0.823 | 6.584 |
| 1.039 | 0.646 | 6.584 | −2.034 | 0.896 | 6.584 | 1.244 | 0.828 | 6.584 |
| 0.929 | 0.626 | 6.584 | −2.027 | 0.900 | 6.584 | 1.341 | 0.833 | 6.584 |
| 0.815 | 0.607 | 6.584 | −2.017 | 0.903 | 6.584 | 1.433 | 0.839 | 6.584 |
| 0.697 | 0.588 | 6.584 | −2.005 | 0.905 | 6.584 | 1.522 | 0.845 | 6.584 |
| 0.574 | 0.570 | 6.584 | −1.989 | 0.906 | 6.584 | 1.602 | 0.850 | 6.584 |

TABLE 2S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.452 | 0.554 | 6.584 | −1.968 | 0.906 | 6.584 | 1.675 | 0.856 | 6.584 |
| 0.328 | 0.540 | 6.584 | −1.942 | 0.906 | 6.584 | 1.739 | 0.861 | 6.584 |
| 0.205 | 0.529 | 6.584 | −1.910 | 0.905 | 6.584 | 1.800 | 0.865 | 6.584 |
| 0.082 | 0.520 | 6.584 | −1.872 | 0.902 | 6.584 | 1.852 | 0.869 | 6.584 |
| −0.042 | 0.513 | 6.584 | −1.828 | 0.899 | 6.584 | 1.892 | 0.873 | 6.584 |
| −0.166 | 0.510 | 6.584 | −1.776 | 0.895 | 6.584 | 1.925 | 0.875 | 6.584 |
| −0.290 | 0.510 | 6.584 | −1.715 | 0.890 | 6.584 | 1.949 | 0.878 | 6.584 |
| −0.413 | 0.513 | 6.584 | −1.647 | 0.884 | 6.584 | 1.967 | 0.876 | 6.584 |
| −0.537 | 0.518 | 6.584 | −1.571 | 0.877 | 6.584 | 1.975 | 0.870 | 6.584 |
| −0.661 | 0.527 | 6.584 | −1.486 | 0.869 | 6.584 | 1.978 | 0.865 | 6.584 |
| −0.784 | 0.539 | 6.584 | −1.394 | 0.862 | 6.584 | 1.979 | 0.862 | 6.584 |
| −0.903 | 0.553 | 6.584 | −1.297 | 0.854 | 6.584 | 1.979 | 0.860 | 6.584 |
| −1.017 | 0.569 | 6.584 | −1.196 | 0.846 | 6.584 | 1.979 | 0.859 | 6.584 |
| −1.127 | 0.587 | 6.584 | −1.092 | 0.839 | 6.584 | | | |
| −1.233 | 0.606 | 6.584 | −0.983 | 0.832 | 6.584 | | | |
| 2.060 | 0.623 | 8.230 | −1.082 | 0.446 | 8.230 | −0.646 | 0.587 | 8.230 |
| 2.060 | 0.621 | 8.230 | −1.174 | 0.468 | 8.230 | −0.535 | 0.579 | 8.230 |
| 2.060 | 0.618 | 8.230 | −1.261 | 0.491 | 8.230 | −0.420 | 0.572 | 8.230 |
| 2.058 | 0.612 | 8.230 | −1.340 | 0.513 | 8.230 | −0.305 | 0.566 | 8.230 |
| 2.052 | 0.604 | 8.230 | −1.411 | 0.534 | 8.230 | −0.190 | 0.561 | 8.230 |
| 2.036 | 0.598 | 8.230 | −1.475 | 0.555 | 8.230 | −0.075 | 0.557 | 8.230 |
| 2.013 | 0.593 | 8.230 | −1.530 | 0.574 | 8.230 | 0.040 | 0.554 | 8.230 |
| 1.982 | 0.586 | 8.230 | −1.578 | 0.591 | 8.230 | 0.155 | 0.552 | 8.230 |
| 1.944 | 0.578 | 8.230 | −1.618 | 0.607 | 8.230 | 0.270 | 0.551 | 8.230 |
| 1.894 | 0.568 | 8.230 | −1.652 | 0.621 | 8.230 | 0.385 | 0.550 | 8.230 |
| 1.836 | 0.556 | 8.230 | −1.680 | 0.634 | 8.230 | 0.500 | 0.551 | 8.230 |
| 1.775 | 0.544 | 8.230 | −1.703 | 0.645 | 8.230 | 0.615 | 0.553 | 8.230 |
| 1.706 | 0.530 | 8.230 | −1.721 | 0.655 | 8.230 | 0.730 | 0.555 | 8.230 |
| 1.629 | 0.515 | 8.230 | −1.734 | 0.664 | 8.230 | 0.845 | 0.558 | 8.230 |
| 1.544 | 0.499 | 8.230 | −1.743 | 0.672 | 8.230 | 0.956 | 0.562 | 8.230 |
| 1.456 | 0.483 | 8.230 | −1.749 | 0.679 | 8.230 | 1.063 | 0.567 | 8.230 |
| 1.363 | 0.466 | 8.230 | −1.753 | 0.686 | 8.230 | 1.167 | 0.572 | 8.230 |
| 1.267 | 0.448 | 8.230 | −1.753 | 0.692 | 8.230 | 1.266 | 0.578 | 8.230 |
| 1.167 | 0.431 | 8.230 | −1.749 | 0.697 | 8.230 | 1.362 | 0.584 | 8.230 |
| 1.063 | 0.414 | 8.230 | −1.742 | 0.700 | 8.230 | 1.454 | 0.590 | 8.230 |
| 0.954 | 0.397 | 8.230 | −1.733 | 0.702 | 8.230 | 1.542 | 0.597 | 8.230 |
| 0.842 | 0.381 | 8.230 | −1.721 | 0.702 | 8.230 | 1.626 | 0.604 | 8.230 |
| 0.726 | 0.367 | 8.230 | −1.706 | 0.702 | 8.230 | 1.702 | 0.610 | 8.230 |
| 0.609 | 0.353 | 8.230 | −1.686 | 0.701 | 8.230 | 1.771 | 0.616 | 8.230 |
| 0.492 | 0.342 | 8.230 | −1.661 | 0.699 | 8.230 | 1.832 | 0.622 | 8.230 |
| 0.375 | 0.333 | 8.230 | −1.631 | 0.696 | 8.230 | 1.889 | 0.627 | 8.230 |
| 0.258 | 0.327 | 8.230 | −1.595 | 0.692 | 8.230 | 1.939 | 0.632 | 8.230 |
| 0.141 | 0.323 | 8.230 | −1.553 | 0.687 | 8.230 | 1.977 | 0.636 | 8.230 |
| 0.023 | 0.321 | 8.230 | −1.504 | 0.681 | 8.230 | 2.008 | 0.639 | 8.230 |
| −0.094 | 0.323 | 8.230 | −1.447 | 0.674 | 8.230 | 2.031 | 0.641 | 8.230 |
| −0.212 | 0.327 | 8.230 | −1.382 | 0.665 | 8.230 | 2.048 | 0.640 | 8.230 |
| −0.329 | 0.335 | 8.230 | −1.310 | 0.656 | 8.230 | 2.055 | 0.634 | 8.230 |
| −0.446 | 0.344 | 8.230 | −1.230 | 0.646 | 8.230 | 2.058 | 0.629 | 8.230 |
| −0.563 | 0.357 | 8.230 | −1.142 | 0.636 | 8.230 | 2.059 | 0.626 | 8.230 |
| −0.675 | 0.372 | 8.230 | −1.051 | 0.625 | 8.230 | 2.059 | 0.624 | 8.230 |
| −0.783 | 0.388 | 8.230 | −0.955 | 0.615 | 8.230 | 2.060 | 0.623 | 8.230 |
| −0.887 | 0.406 | 8.230 | −0.856 | 0.605 | 8.230 | | | |
| −0.987 | 0.426 | 8.230 | −0.753 | 0.596 | 8.230 | | | |
| 2.249 | 0.225 | 9.877 | −0.758 | 0.122 | 9.877 | −0.340 | 0.213 | 9.877 |
| 2.249 | 0.223 | 9.877 | −0.844 | 0.145 | 9.877 | −0.234 | 0.202 | 9.877 |
| 2.249 | 0.220 | 9.877 | −0.927 | 0.169 | 9.877 | −0.124 | 0.191 | 9.877 |
| 2.248 | 0.214 | 9.877 | −1.002 | 0.192 | 9.877 | −0.014 | 0.182 | 9.877 |
| 2.242 | 0.207 | 9.877 | −1.070 | 0.214 | 9.877 | 0.096 | 0.174 | 9.877 |
| 2.227 | 0.201 | 9.877 | −1.130 | 0.234 | 9.877 | 0.206 | 0.167 | 9.877 |
| 2.205 | 0.196 | 9.877 | −1.183 | 0.254 | 9.877 | 0.316 | 0.162 | 9.877 |
| 2.176 | 0.190 | 9.877 | −1.229 | 0.271 | 9.877 | 0.426 | 0.158 | 9.877 |
| 2.139 | 0.183 | 9.877 | −1.267 | 0.287 | 9.877 | 0.536 | 0.155 | 9.877 |
| 2.091 | 0.174 | 9.877 | −1.299 | 0.300 | 9.877 | 0.646 | 0.154 | 9.877 |
| 2.036 | 0.163 | 9.877 | −1.326 | 0.313 | 9.877 | 0.756 | 0.153 | 9.877 |
| 1.977 | 0.152 | 9.877 | −1.348 | 0.323 | 9.877 | 0.866 | 0.154 | 9.877 |
| 1.911 | 0.140 | 9.877 | −1.365 | 0.332 | 9.877 | 0.976 | 0.156 | 9.877 |
| 1.837 | 0.127 | 9.877 | −1.378 | 0.341 | 9.877 | 1.086 | 0.159 | 9.877 |
| 1.756 | 0.112 | 9.877 | −1.387 | 0.348 | 9.877 | 1.192 | 0.163 | 9.877 |
| 1.671 | 0.098 | 9.877 | −1.393 | 0.355 | 9.877 | 1.295 | 0.167 | 9.877 |
| 1.582 | 0.083 | 9.877 | −1.396 | 0.362 | 9.877 | 1.394 | 0.172 | 9.877 |
| 1.489 | 0.068 | 9.877 | −1.396 | 0.367 | 9.877 | 1.489 | 0.178 | 9.877 |
| 1.393 | 0.054 | 9.877 | −1.393 | 0.371 | 9.877 | 1.581 | 0.183 | 9.877 |
| 1.293 | 0.039 | 9.877 | −1.386 | 0.374 | 9.877 | 1.669 | 0.190 | 9.877 |
| 1.189 | 0.025 | 9.877 | −1.377 | 0.375 | 9.877 | 1.753 | 0.197 | 9.877 |
| 1.081 | 0.012 | 9.877 | −1.366 | 0.374 | 9.877 | 1.834 | 0.204 | 9.877 |
| 0.969 | 0.000 | 9.877 | −1.351 | 0.373 | 9.877 | 1.907 | 0.210 | 9.877 |
| 0.858 | −0.010 | 9.877 | −1.332 | 0.370 | 9.877 | 1.973 | 0.217 | 9.877 |

TABLE 2S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.745 | −0.018 | 9.877 | −1.308 | 0.367 | 9.877 | 2.032 | 0.223 | 9.877 |
| 0.633 | −0.024 | 9.877 | −1.280 | 0.362 | 9.877 | 2.087 | 0.228 | 9.877 |
| 0.521 | −0.027 | 9.877 | −1.246 | 0.356 | 9.877 | 2.134 | 0.233 | 9.877 |
| 0.409 | −0.028 | 9.877 | −1.206 | 0.349 | 9.877 | 2.171 | 0.237 | 9.877 |
| 0.297 | −0.026 | 9.877 | −1.159 | 0.340 | 9.877 | 2.200 | 0.240 | 9.877 |
| 0.185 | −0.021 | 9.877 | −1.104 | 0.330 | 9.877 | 2.222 | 0.243 | 9.877 |
| 0.073 | −0.014 | 9.877 | −1.043 | 0.319 | 9.877 | 2.238 | 0.242 | 9.877 |
| −0.039 | −0.004 | 9.877 | −0.974 | 0.307 | 9.877 | 2.245 | 0.236 | 9.877 |
| −0.151 | 0.008 | 9.877 | −0.898 | 0.293 | 9.877 | 2.248 | 0.231 | 9.877 |
| −0.262 | 0.023 | 9.877 | −0.814 | 0.279 | 9.877 | 2.249 | 0.228 | 9.877 |
| −0.370 | 0.040 | 9.877 | −0.727 | 0.266 | 9.877 | 2.249 | 0.226 | 9.877 |
| −0.473 | 0.059 | 9.877 | −0.636 | 0.252 | 9.877 | 2.249 | 0.226 | 9.877 |
| −0.572 | 0.079 | 9.877 | −0.541 | 0.238 | 9.877 | | | |
| −0.667 | 0.100 | 9.877 | −0.443 | 0.225 | 9.877 | | | |
| 2.365 | −0.033 | 10.700 | −0.589 | −0.088 | 10.700 | −0.179 | −0.018 | 10.700 |
| 2.366 | −0.035 | 10.700 | −0.674 | −0.063 | 10.700 | −0.075 | −0.032 | 10.700 |
| 2.365 | −0.038 | 10.700 | −0.754 | −0.038 | 10.700 | 0.032 | −0.045 | 10.700 |
| 2.364 | −0.044 | 10.700 | −0.828 | −0.014 | 10.700 | 0.140 | −0.056 | 10.700 |
| 2.358 | −0.051 | 10.700 | −0.894 | 0.009 | 10.700 | 0.248 | −0.066 | 10.700 |
| 2.343 | −0.057 | 10.700 | −0.953 | 0.031 | 10.700 | 0.357 | −0.074 | 10.700 |
| 2.321 | −0.061 | 10.700 | −1.004 | 0.051 | 10.700 | 0.465 | −0.081 | 10.700 |
| 2.292 | −0.067 | 10.700 | −1.049 | 0.069 | 10.700 | 0.573 | −0.087 | 10.700 |
| 2.256 | −0.074 | 10.700 | −1.086 | 0.085 | 10.700 | 0.681 | −0.091 | 10.700 |
| 2.209 | −0.083 | 10.700 | −1.118 | 0.099 | 10.700 | 0.789 | −0.094 | 10.700 |
| 2.155 | −0.093 | 10.700 | −1.144 | 0.111 | 10.700 | 0.897 | −0.096 | 10.700 |
| 2.097 | −0.104 | 10.700 | −1.166 | 0.122 | 10.700 | 1.005 | −0.096 | 10.700 |
| 2.031 | −0.115 | 10.700 | −1.182 | 0.131 | 10.700 | 1.113 | −0.095 | 10.700 |
| 1.958 | −0.128 | 10.700 | −1.195 | 0.139 | 10.700 | 1.221 | −0.093 | 10.700 |
| 1.878 | −0.141 | 10.700 | −1.203 | 0.146 | 10.700 | 1.326 | −0.091 | 10.700 |
| 1.795 | −0.155 | 10.700 | −1.209 | 0.153 | 10.700 | 1.427 | −0.087 | 10.700 |
| 1.707 | −0.168 | 10.700 | −1.213 | 0.160 | 10.700 | 1.524 | −0.083 | 10.700 |
| 1.616 | −0.182 | 10.700 | −1.213 | 0.165 | 10.700 | 1.618 | −0.078 | 10.700 |
| 1.521 | −0.195 | 10.700 | −1.209 | 0.169 | 10.700 | 1.708 | −0.072 | 10.700 |
| 1.422 | −0.208 | 10.700 | −1.202 | 0.171 | 10.700 | 1.795 | −0.067 | 10.700 |
| 1.320 | −0.220 | 10.700 | −1.193 | 0.172 | 10.700 | 1.878 | −0.060 | 10.700 |
| 1.213 | −0.231 | 10.700 | −1.182 | 0.171 | 10.700 | 1.957 | −0.054 | 10.700 |
| 1.103 | −0.242 | 10.700 | −1.168 | 0.169 | 10.700 | 2.029 | −0.047 | 10.700 |
| 0.993 | −0.250 | 10.700 | −1.149 | 0.166 | 10.700 | 2.094 | −0.041 | 10.700 |
| 0.883 | −0.256 | 10.700 | −1.126 | 0.162 | 10.700 | 2.151 | −0.035 | 10.700 |
| 0.772 | −0.260 | 10.700 | −1.098 | 0.156 | 10.700 | 2.205 | −0.030 | 10.700 |
| 0.661 | −0.261 | 10.700 | −1.065 | 0.149 | 10.700 | 2.252 | −0.025 | 10.700 |
| 0.551 | −0.260 | 10.700 | −1.026 | 0.141 | 10.700 | 2.288 | −0.021 | 10.700 |
| 0.440 | −0.257 | 10.700 | −0.980 | 0.131 | 10.700 | 2.317 | −0.018 | 10.700 |
| 0.330 | −0.250 | 10.700 | −0.927 | 0.119 | 10.700 | 2.338 | −0.015 | 10.700 |
| 0.220 | −0.241 | 10.700 | −0.867 | 0.106 | 10.700 | 2.354 | −0.017 | 10.700 |
| 0.110 | −0.229 | 10.700 | −0.799 | 0.092 | 10.700 | 2.361 | −0.023 | 10.700 |
| 0.001 | −0.214 | 10.700 | −0.725 | 0.077 | 10.700 | 2.364 | −0.028 | 10.700 |
| −0.107 | −0.197 | 10.700 | −0.643 | 0.061 | 10.700 | 2.365 | −0.030 | 10.700 |
| −0.212 | −0.177 | 10.700 | −0.558 | 0.045 | 10.700 | 2.365 | −0.032 | 10.700 |
| −0.312 | −0.157 | 10.700 | −0.469 | 0.029 | 10.700 | 2.365 | −0.033 | 10.700 |
| −0.408 | −0.135 | 10.700 | −0.376 | 0.013 | 10.700 | | | |
| −0.501 | −0.112 | 10.700 | −0.280 | −0.003 | 10.700 | | | |
| 2.478 | −0.338 | 11.523 | −0.428 | −0.298 | 11.523 | −0.024 | −0.252 | 11.523 |
| 2.478 | −0.340 | 11.523 | −0.510 | −0.270 | 11.523 | 0.078 | −0.271 | 11.523 |
| 2.478 | −0.343 | 11.523 | −0.588 | −0.242 | 11.523 | 0.183 | −0.289 | 11.523 |
| 2.476 | −0.348 | 11.523 | −0.659 | −0.215 | 11.523 | 0.289 | −0.305 | 11.523 |
| 2.471 | −0.356 | 11.523 | −0.724 | −0.190 | 11.523 | 0.395 | −0.319 | 11.523 |
| 2.456 | −0.362 | 11.523 | −0.781 | −0.166 | 11.523 | 0.501 | −0.332 | 11.523 |
| 2.434 | −0.366 | 11.523 | −0.830 | −0.144 | 11.523 | 0.607 | −0.343 | 11.523 |
| 2.406 | −0.371 | 11.523 | −0.873 | −0.125 | 11.523 | 0.713 | −0.352 | 11.523 |
| 2.370 | −0.377 | 11.523 | −0.910 | −0.108 | 11.523 | 0.819 | −0.360 | 11.523 |
| 2.324 | −0.386 | 11.523 | −0.940 | −0.092 | 11.523 | 0.925 | −0.367 | 11.523 |
| 2.270 | −0.395 | 11.523 | −0.966 | −0.079 | 11.523 | 1.032 | −0.372 | 11.523 |
| 2.213 | −0.405 | 11.523 | −0.987 | −0.068 | 11.523 | 1.138 | −0.376 | 11.523 |
| 2.148 | −0.416 | 11.523 | −1.003 | −0.059 | 11.523 | 1.244 | −0.378 | 11.523 |
| 2.076 | −0.427 | 11.523 | −1.015 | −0.050 | 11.523 | 1.351 | −0.379 | 11.523 |
| 1.997 | −0.439 | 11.523 | −1.023 | −0.043 | 11.523 | 1.454 | −0.379 | 11.523 |
| 1.915 | −0.451 | 11.523 | −1.029 | −0.036 | 11.523 | 1.553 | −0.378 | 11.523 |
| 1.828 | −0.463 | 11.523 | −1.032 | −0.029 | 11.523 | 1.649 | −0.376 | 11.523 |
| 1.738 | −0.474 | 11.523 | −1.032 | −0.024 | 11.523 | 1.741 | −0.373 | 11.523 |
| 1.644 | −0.485 | 11.523 | −1.028 | −0.020 | 11.523 | 1.830 | −0.369 | 11.523 |
| 1.547 | −0.496 | 11.523 | −1.021 | −0.019 | 11.523 | 1.916 | −0.365 | 11.523 |
| 1.446 | −0.505 | 11.523 | −1.012 | −0.019 | 11.523 | 1.997 | −0.360 | 11.523 |
| 1.341 | −0.514 | 11.523 | −1.002 | −0.020 | 11.523 | 2.076 | −0.355 | 11.523 |
| 1.232 | −0.520 | 11.523 | −0.988 | −0.023 | 11.523 | 2.147 | −0.349 | 11.523 |
| 1.123 | −0.525 | 11.523 | −0.969 | −0.027 | 11.523 | 2.210 | −0.344 | 11.523 |
| 1.014 | −0.527 | 11.523 | −0.947 | −0.032 | 11.523 | 2.267 | −0.339 | 11.523 |

TABLE 2S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.905 | −0.527 | 11.523 | −0.920 | −0.039 | 11.523 | 2.320 | −0.334 | 11.523 |
| 0.796 | −0.525 | 11.523 | −0.887 | −0.047 | 11.523 | 2.366 | −0.329 | 11.523 |
| 0.688 | −0.519 | 11.523 | −0.849 | −0.057 | 11.523 | 2.402 | −0.326 | 11.523 |
| 0.579 | −0.511 | 11.523 | −0.804 | −0.069 | 11.523 | 2.430 | −0.323 | 11.523 |
| 0.471 | −0.500 | 11.523 | −0.753 | −0.082 | 11.523 | 2.451 | −0.320 | 11.523 |
| 0.363 | −0.486 | 11.523 | −0.694 | −0.098 | 11.523 | 2.467 | −0.322 | 11.523 |
| 0.255 | −0.470 | 11.523 | −0.629 | −0.115 | 11.523 | 2.474 | −0.327 | 11.523 |
| 0.148 | −0.450 | 11.523 | −0.556 | −0.134 | 11.523 | 2.477 | −0.332 | 11.523 |
| 0.042 | −0.428 | 11.523 | −0.476 | −0.153 | 11.523 | 2.478 | −0.335 | 11.523 |
| −0.060 | −0.404 | 11.523 | −0.393 | −0.173 | 11.523 | 2.478 | −0.337 | 11.523 |
| −0.158 | −0.379 | 11.523 | −0.306 | −0.193 | 11.523 | 2.478 | −0.337 | 11.523 |
| −0.252 | −0.353 | 11.523 | −0.216 | −0.213 | 11.523 | | | |
| −0.342 | −0.326 | 11.523 | −0.122 | −0.233 | 11.523 | | | |
| 2.651 | −1.054 | 13.169 | −0.132 | −0.660 | 13.169 | 0.258 | −0.677 | 13.169 |
| 2.651 | −1.055 | 13.169 | −0.207 | −0.620 | 13.169 | 0.353 | −0.710 | 13.169 |
| 2.651 | −1.058 | 13.169 | −0.277 | −0.581 | 13.169 | 0.451 | −0.743 | 13.169 |
| 2.649 | −1.063 | 13.169 | −0.342 | −0.544 | 13.169 | 0.550 | −0.773 | 13.169 |
| 2.643 | −1.070 | 13.169 | −0.399 | −0.510 | 13.169 | 0.649 | −0.803 | 13.169 |
| 2.629 | −1.075 | 13.169 | −0.451 | −0.478 | 13.169 | 0.749 | −0.830 | 13.169 |
| 2.608 | −1.079 | 13.169 | −0.495 | −0.450 | 13.169 | 0.849 | −0.856 | 13.169 |
| 2.580 | −1.083 | 13.169 | −0.534 | −0.425 | 13.169 | 0.950 | −0.880 | 13.169 |
| 2.545 | −1.088 | 13.169 | −0.566 | −0.403 | 13.169 | 1.051 | −0.903 | 13.169 |
| 2.499 | −1.094 | 13.169 | −0.593 | −0.384 | 13.169 | 1.152 | −0.924 | 13.169 |
| 2.446 | −1.100 | 13.169 | −0.616 | −0.368 | 13.169 | 1.253 | −0.943 | 13.169 |
| 2.390 | −1.107 | 13.169 | −0.634 | −0.354 | 13.169 | 1.355 | −0.962 | 13.169 |
| 2.327 | −1.113 | 13.169 | −0.649 | −0.342 | 13.169 | 1.457 | −0.978 | 13.169 |
| 2.256 | −1.120 | 13.169 | −0.659 | −0.333 | 13.169 | 1.559 | −0.993 | 13.169 |
| 2.179 | −1.126 | 13.169 | −0.666 | −0.325 | 13.169 | 1.657 | −1.005 | 13.169 |
| 2.098 | −1.131 | 13.169 | −0.671 | −0.317 | 13.169 | 1.753 | −1.016 | 13.169 |
| 2.013 | −1.135 | 13.169 | −0.673 | −0.310 | 13.169 | 1.846 | −1.025 | 13.169 |
| 1.925 | −1.138 | 13.169 | −0.672 | −0.305 | 13.169 | 1.935 | −1.032 | 13.169 |
| 1.833 | −1.139 | 13.169 | −0.668 | −0.302 | 13.169 | 2.021 | −1.038 | 13.169 |
| 1.737 | −1.139 | 13.169 | −0.661 | −0.302 | 13.169 | 2.104 | −1.041 | 13.169 |
| 1.638 | −1.136 | 13.169 | −0.652 | −0.303 | 13.169 | 2.183 | −1.044 | 13.169 |
| 1.536 | −1.131 | 13.169 | −0.642 | −0.306 | 13.169 | 2.259 | −1.045 | 13.169 |
| 1.430 | −1.124 | 13.169 | −0.629 | −0.311 | 13.169 | 2.328 | −1.045 | 13.169 |
| 1.325 | −1.114 | 13.169 | −0.613 | −0.318 | 13.169 | 2.391 | −1.044 | 13.169 |
| 1.220 | −1.101 | 13.169 | −0.592 | −0.327 | 13.169 | 2.446 | −1.043 | 13.169 |
| 1.115 | −1.085 | 13.169 | −0.567 | −0.337 | 13.169 | 2.498 | −1.041 | 13.169 |
| 1.011 | −1.066 | 13.169 | −0.537 | −0.350 | 13.169 | 2.543 | −1.040 | 13.169 |
| 0.907 | −1.045 | 13.169 | −0.502 | −0.366 | 13.169 | 2.577 | −1.038 | 13.169 |
| 0.803 | −1.021 | 13.169 | −0.461 | −0.384 | 13.169 | 2.605 | −1.036 | 13.169 |
| 0.701 | −0.993 | 13.169 | −0.414 | −0.405 | 13.169 | 2.626 | −1.035 | 13.169 |
| 0.599 | −0.963 | 13.169 | −0.360 | −0.429 | 13.169 | 2.641 | −1.037 | 13.169 |
| 0.499 | −0.931 | 13.169 | −0.300 | −0.455 | 13.169 | 2.647 | −1.043 | 13.169 |
| 0.399 | −0.895 | 13.169 | −0.234 | −0.484 | 13.169 | 2.650 | −1.048 | 13.169 |
| 0.300 | −0.857 | 13.169 | −0.160 | −0.515 | 13.169 | 2.651 | −1.051 | 13.169 |
| 0.205 | −0.819 | 13.169 | −0.084 | −0.547 | 13.169 | 2.651 | −1.052 | 13.169 |
| 0.115 | −0.779 | 13.169 | −0.004 | −0.579 | 13.169 | 2.651 | −1.053 | 13.169 |
| 0.029 | −0.740 | 13.169 | 0.080 | −0.611 | 13.169 | | | |
| −0.054 | −0.700 | 13.169 | 0.167 | −0.644 | 13.169 | | | |

The coordinate values given in TABLE 3S below provide the nominal profile envelope for an exemplary third stage stator.

TABLE 3S

| X-LOC | Y-LOC | Z-LOC | X-LOC | Y-LOC | Z-LOC | X-LOC | Y-LOC | Z-LOC |
|---|---|---|---|---|---|---|---|---|
| 2.161 | 0.004 | 0.000 | −1.274 | −0.166 | 0.000 | −0.748 | 0.106 | 0.000 |
| 2.161 | 0.003 | 0.000 | −1.370 | −0.128 | 0.000 | −0.630 | 0.091 | 0.000 |
| 2.161 | −0.001 | 0.000 | −1.461 | −0.088 | 0.000 | −0.507 | 0.076 | 0.000 |
| 2.160 | −0.008 | 0.000 | −1.543 | −0.049 | 0.000 | −0.384 | 0.063 | 0.000 |
| 2.154 | −0.017 | 0.000 | −1.616 | −0.011 | 0.000 | −0.261 | 0.050 | 0.000 |
| 2.136 | −0.024 | 0.000 | −1.681 | 0.026 | 0.000 | −0.138 | 0.037 | 0.000 |
| 2.112 | −0.033 | 0.000 | −1.737 | 0.060 | 0.000 | −0.014 | 0.025 | 0.000 |
| 2.079 | −0.043 | 0.000 | −1.784 | 0.092 | 0.000 | 0.109 | 0.014 | 0.000 |
| 2.037 | −0.057 | 0.000 | −1.822 | 0.120 | 0.000 | 0.232 | 0.004 | 0.000 |
| 1.984 | −0.075 | 0.000 | −1.854 | 0.146 | 0.000 | 0.355 | −0.005 | 0.000 |
| 1.921 | −0.094 | 0.000 | −1.879 | 0.169 | 0.000 | 0.479 | −0.013 | 0.000 |
| 1.855 | −0.115 | 0.000 | −1.899 | 0.189 | 0.000 | 0.602 | −0.019 | 0.000 |
| 1.780 | −0.138 | 0.000 | −1.914 | 0.207 | 0.000 | 0.726 | −0.023 | 0.000 |

TABLE 3S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.697 | −0.163 | 0.000 | −1.924 | 0.221 | 0.000 | 0.849 | −0.027 | 0.000 |
| 1.605 | −0.190 | 0.000 | −1.930 | 0.233 | 0.000 | 0.969 | −0.029 | 0.000 |
| 1.509 | −0.217 | 0.000 | −1.932 | 0.244 | 0.000 | 1.084 | −0.029 | 0.000 |
| 1.409 | −0.245 | 0.000 | −1.932 | 0.253 | 0.000 | 1.196 | −0.029 | 0.000 |
| 1.304 | −0.272 | 0.000 | −1.930 | 0.259 | 0.000 | 1.303 | −0.027 | 0.000 |
| 1.194 | −0.300 | 0.000 | −1.926 | 0.264 | 0.000 | 1.406 | −0.025 | 0.000 |
| 1.080 | −0.326 | 0.000 | −1.920 | 0.270 | 0.000 | 1.505 | −0.021 | 0.000 |
| 0.961 | −0.351 | 0.000 | −1.911 | 0.274 | 0.000 | 1.600 | −0.017 | 0.000 |
| 0.837 | −0.374 | 0.000 | −1.899 | 0.277 | 0.000 | 1.691 | −0.012 | 0.000 |
| 0.708 | −0.394 | 0.000 | −1.882 | 0.279 | 0.000 | 1.774 | −0.007 | 0.000 |
| 0.579 | −0.410 | 0.000 | −1.861 | 0.279 | 0.000 | 1.848 | −0.002 | 0.000 |
| 0.450 | −0.421 | 0.000 | −1.834 | 0.277 | 0.000 | 1.914 | 0.003 | 0.000 |
| 0.320 | −0.428 | 0.000 | −1.802 | 0.274 | 0.000 | 1.976 | 0.008 | 0.000 |
| 0.190 | −0.430 | 0.000 | −1.763 | 0.269 | 0.000 | 2.029 | 0.013 | 0.000 |
| 0.060 | −0.429 | 0.000 | −1.718 | 0.262 | 0.000 | 2.070 | 0.017 | 0.000 |
| −0.070 | −0.423 | 0.000 | −1.665 | 0.253 | 0.000 | 2.103 | 0.020 | 0.000 |
| −0.200 | −0.412 | 0.000 | −1.604 | 0.242 | 0.000 | 2.128 | 0.022 | 0.000 |
| −0.329 | −0.398 | 0.000 | −1.535 | 0.230 | 0.000 | 2.146 | 0.021 | 0.000 |
| −0.458 | −0.380 | 0.000 | −1.458 | 0.216 | 0.000 | 2.155 | 0.016 | 0.000 |
| −0.586 | −0.358 | 0.000 | −1.373 | 0.202 | 0.000 | 2.159 | 0.011 | 0.000 |
| −0.714 | −0.332 | 0.000 | −1.279 | 0.186 | 0.000 | 2.160 | 0.008 | 0.000 |
| −0.837 | −0.303 | 0.000 | −1.181 | 0.169 | 0.000 | 2.161 | 0.006 | 0.000 |
| −0.954 | −0.272 | 0.000 | −1.079 | 0.153 | 0.000 | 2.161 | 0.005 | 0.000 |
| −1.066 | −0.238 | 0.000 | −0.973 | 0.137 | 0.000 | | | |
| −1.173 | −0.203 | 0.000 | −0.863 | 0.121 | 0.000 | | | |
| 1.650 | 0.765 | 1.342 | −1.528 | 0.434 | 1.342 | −1.073 | 0.714 | 1.342 |
| 1.650 | 0.763 | 1.342 | −1.621 | 0.456 | 1.342 | −0.961 | 0.711 | 1.342 |
| 1.650 | 0.760 | 1.342 | −1.709 | 0.480 | 1.342 | −0.846 | 0.709 | 1.342 |
| 1.649 | 0.754 | 1.342 | −1.788 | 0.504 | 1.342 | −0.730 | 0.708 | 1.342 |
| 1.643 | 0.746 | 1.342 | −1.860 | 0.528 | 1.342 | −0.615 | 0.707 | 1.342 |
| 1.627 | 0.739 | 1.342 | −1.924 | 0.551 | 1.342 | −0.499 | 0.706 | 1.342 |
| 1.604 | 0.733 | 1.342 | −1.979 | 0.574 | 1.342 | −0.383 | 0.705 | 1.342 |
| 1.573 | 0.725 | 1.342 | −2.027 | 0.596 | 1.342 | −0.268 | 0.705 | 1.342 |
| 1.535 | 0.714 | 1.342 | −2.066 | 0.615 | 1.342 | −0.152 | 0.705 | 1.342 |
| 1.485 | 0.701 | 1.342 | −2.099 | 0.633 | 1.342 | −0.036 | 0.705 | 1.342 |
| 1.427 | 0.686 | 1.342 | −2.126 | 0.650 | 1.342 | 0.079 | 0.706 | 1.342 |
| 1.365 | 0.670 | 1.342 | −2.147 | 0.665 | 1.342 | 0.195 | 0.707 | 1.342 |
| 1.296 | 0.652 | 1.342 | −2.163 | 0.678 | 1.342 | 0.311 | 0.710 | 1.342 |
| 1.219 | 0.632 | 1.342 | −2.174 | 0.690 | 1.342 | 0.426 | 0.712 | 1.342 |
| 1.134 | 0.610 | 1.342 | −2.181 | 0.700 | 1.342 | 0.538 | 0.716 | 1.342 |
| 1.045 | 0.588 | 1.342 | −2.186 | 0.709 | 1.342 | 0.646 | 0.720 | 1.342 |
| 0.952 | 0.565 | 1.342 | −2.187 | 0.717 | 1.342 | 0.750 | 0.724 | 1.342 |
| 0.855 | 0.541 | 1.342 | −2.186 | 0.723 | 1.342 | 0.850 | 0.729 | 1.342 |
| 0.754 | 0.517 | 1.342 | −2.183 | 0.728 | 1.342 | 0.946 | 0.734 | 1.342 |
| 0.650 | 0.493 | 1.342 | −2.178 | 0.734 | 1.342 | 1.038 | 0.740 | 1.342 |
| 0.541 | 0.469 | 1.342 | −2.170 | 0.739 | 1.342 | 1.127 | 0.745 | 1.342 |
| 0.427 | 0.446 | 1.342 | −2.159 | 0.743 | 1.342 | 1.212 | 0.751 | 1.342 |
| 0.310 | 0.424 | 1.342 | −2.144 | 0.746 | 1.342 | 1.288 | 0.757 | 1.342 |
| 0.192 | 0.404 | 1.342 | −2.124 | 0.749 | 1.342 | 1.358 | 0.762 | 1.342 |
| 0.074 | 0.386 | 1.342 | −2.099 | 0.751 | 1.342 | 1.419 | 0.767 | 1.342 |
| −0.044 | 0.370 | 1.342 | −2.069 | 0.751 | 1.342 | 1.477 | 0.771 | 1.342 |
| −0.163 | 0.357 | 1.342 | −2.032 | 0.751 | 1.342 | 1.527 | 0.775 | 1.342 |
| −0.282 | 0.347 | 1.342 | −1.990 | 0.750 | 1.342 | 1.565 | 0.778 | 1.342 |
| −0.401 | 0.340 | 1.342 | −1.940 | 0.748 | 1.342 | 1.596 | 0.781 | 1.342 |
| −0.520 | 0.336 | 1.342 | −1.882 | 0.746 | 1.342 | 1.619 | 0.783 | 1.342 |
| −0.640 | 0.335 | 1.342 | −1.817 | 0.743 | 1.342 | 1.636 | 0.781 | 1.342 |
| −0.760 | 0.337 | 1.342 | −1.744 | 0.739 | 1.342 | 1.644 | 0.776 | 1.342 |
| −0.879 | 0.343 | 1.342 | −1.663 | 0.735 | 1.342 | 1.647 | 0.771 | 1.342 |
| −0.998 | 0.352 | 1.342 | −1.574 | 0.731 | 1.342 | 1.649 | 0.768 | 1.342 |
| −1.113 | 0.364 | 1.342 | −1.482 | 0.727 | 1.342 | 1.649 | 0.766 | 1.342 |
| −1.224 | 0.378 | 1.342 | −1.385 | 0.723 | 1.342 | 1.649 | 0.766 | 1.342 |
| −1.330 | 0.395 | 1.342 | −1.285 | 0.720 | 1.342 | | | |
| −1.431 | 0.413 | 1.342 | −1.181 | 0.717 | 1.342 | | | |
| 1.354 | 1.205 | 2.349 | −1.711 | 0.820 | 2.349 | −1.281 | 1.072 | 2.349 |
| 1.354 | 1.204 | 2.349 | −1.801 | 0.839 | 2.349 | −1.173 | 1.071 | 2.349 |
| 1.355 | 1.201 | 2.349 | −1.887 | 0.859 | 2.349 | −1.061 | 1.072 | 2.349 |
| 1.354 | 1.195 | 2.349 | −1.965 | 0.879 | 2.349 | −0.949 | 1.072 | 2.349 |
| 1.349 | 1.186 | 2.349 | −2.035 | 0.900 | 2.349 | −0.837 | 1.074 | 2.349 |
| 1.333 | 1.179 | 2.349 | −2.097 | 0.920 | 2.349 | −0.724 | 1.075 | 2.349 |
| 1.311 | 1.172 | 2.349 | −2.152 | 0.939 | 2.349 | −0.612 | 1.078 | 2.349 |
| 1.281 | 1.164 | 2.349 | −2.199 | 0.958 | 2.349 | −0.500 | 1.080 | 2.349 |
| 1.244 | 1.153 | 2.349 | −2.238 | 0.974 | 2.349 | −0.388 | 1.083 | 2.349 |
| 1.196 | 1.139 | 2.349 | −2.270 | 0.990 | 2.349 | −0.276 | 1.087 | 2.349 |
| 1.141 | 1.123 | 2.349 | −2.297 | 1.004 | 2.349 | −0.164 | 1.091 | 2.349 |
| 1.082 | 1.106 | 2.349 | −2.319 | 1.017 | 2.349 | −0.052 | 1.096 | 2.349 |
| 1.015 | 1.087 | 2.349 | −2.335 | 1.029 | 2.349 | 0.060 | 1.102 | 2.349 |
| 0.941 | 1.066 | 2.349 | −2.347 | 1.039 | 2.349 | 0.172 | 1.108 | 2.349 |

TABLE 3S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.859 | 1.044 | 2.349 | −2.354 | 1.048 | 2.349 | 0.280 | 1.115 | 2.349 |
| 0.774 | 1.020 | 2.349 | −2.359 | 1.057 | 2.349 | 0.384 | 1.123 | 2.349 |
| 0.684 | 0.997 | 2.349 | −2.361 | 1.064 | 2.349 | 0.485 | 1.131 | 2.349 |
| 0.591 | 0.972 | 2.349 | −2.361 | 1.070 | 2.349 | 0.582 | 1.139 | 2.349 |
| 0.494 | 0.947 | 2.349 | −2.358 | 1.075 | 2.349 | 0.675 | 1.147 | 2.349 |
| 0.393 | 0.923 | 2.349 | −2.353 | 1.081 | 2.349 | 0.764 | 1.156 | 2.349 |
| 0.288 | 0.898 | 2.349 | −2.345 | 1.085 | 2.349 | 0.849 | 1.165 | 2.349 |
| 0.179 | 0.874 | 2.349 | −2.334 | 1.089 | 2.349 | 0.931 | 1.174 | 2.349 |
| 0.066 | 0.851 | 2.349 | −2.320 | 1.093 | 2.349 | 1.005 | 1.183 | 2.349 |
| −0.047 | 0.829 | 2.349 | −2.301 | 1.095 | 2.349 | 1.072 | 1.191 | 2.349 |
| −0.161 | 0.810 | 2.349 | −2.276 | 1.097 | 2.349 | 1.132 | 1.198 | 2.349 |
| −0.275 | 0.793 | 2.349 | −2.247 | 1.097 | 2.349 | 1.187 | 1.205 | 2.349 |
| −0.390 | 0.778 | 2.349 | −2.212 | 1.097 | 2.349 | 1.236 | 1.211 | 2.349 |
| −0.505 | 0.766 | 2.349 | −2.171 | 1.096 | 2.349 | 1.273 | 1.215 | 2.349 |
| −0.620 | 0.756 | 2.349 | −2.122 | 1.095 | 2.349 | 1.302 | 1.219 | 2.349 |
| −0.735 | 0.750 | 2.349 | −2.066 | 1.093 | 2.349 | 1.325 | 1.222 | 2.349 |
| −0.851 | 0.747 | 2.349 | −2.003 | 1.090 | 2.349 | 1.341 | 1.221 | 2.349 |
| −0.966 | 0.747 | 2.349 | −1.932 | 1.088 | 2.349 | 1.349 | 1.216 | 2.349 |
| −1.081 | 0.750 | 2.349 | −1.853 | 1.085 | 2.349 | 1.352 | 1.211 | 2.349 |
| −1.196 | 0.756 | 2.349 | −1.767 | 1.082 | 2.349 | 1.353 | 1.208 | 2.349 |
| −1.307 | 0.765 | 2.349 | −1.677 | 1.079 | 2.349 | 1.354 | 1.207 | 2.349 |
| −1.415 | 0.775 | 2.349 | −1.584 | 1.076 | 2.349 | 1.354 | 1.206 | 2.349 |
| −1.518 | 0.788 | 2.349 | −1.487 | 1.074 | 2.349 | | | |
| −1.617 | 0.804 | 2.349 | −1.386 | 1.073 | 2.349 | | | |
| 1.171 | 1.445 | 3.356 | −1.806 | 1.041 | 3.356 | −1.393 | 1.278 | 3.356 |
| 1.171 | 1.443 | 3.356 | −1.894 | 1.058 | 3.356 | −1.287 | 1.279 | 3.356 |
| 1.172 | 1.440 | 3.356 | −1.977 | 1.076 | 3.356 | −1.178 | 1.280 | 3.356 |
| 1.171 | 1.434 | 3.356 | −2.054 | 1.095 | 3.356 | −1.069 | 1.281 | 3.356 |
| 1.166 | 1.426 | 3.356 | −2.122 | 1.113 | 3.356 | −0.959 | 1.284 | 3.356 |
| 1.151 | 1.418 | 3.356 | −2.183 | 1.132 | 3.356 | −0.850 | 1.286 | 3.356 |
| 1.130 | 1.412 | 3.356 | −2.236 | 1.149 | 3.356 | −0.741 | 1.290 | 3.356 |
| 1.101 | 1.403 | 3.356 | −2.282 | 1.166 | 3.356 | −0.632 | 1.294 | 3.356 |
| 1.065 | 1.392 | 3.356 | −2.321 | 1.181 | 3.356 | −0.523 | 1.298 | 3.356 |
| 1.019 | 1.378 | 3.356 | −2.353 | 1.196 | 3.356 | −0.414 | 1.303 | 3.356 |
| 0.965 | 1.362 | 3.356 | −2.379 | 1.209 | 3.356 | −0.305 | 1.309 | 3.356 |
| 0.907 | 1.345 | 3.356 | −2.401 | 1.221 | 3.356 | −0.196 | 1.315 | 3.356 |
| 0.843 | 1.326 | 3.356 | −2.417 | 1.232 | 3.356 | −0.088 | 1.322 | 3.356 |
| 0.771 | 1.305 | 3.356 | −2.429 | 1.241 | 3.356 | 0.021 | 1.330 | 3.356 |
| 0.691 | 1.282 | 3.356 | −2.437 | 1.249 | 3.356 | 0.126 | 1.339 | 3.356 |
| 0.609 | 1.259 | 3.356 | −2.442 | 1.257 | 3.356 | 0.228 | 1.348 | 3.356 |
| 0.522 | 1.235 | 3.356 | −2.444 | 1.265 | 3.356 | 0.326 | 1.357 | 3.356 |
| 0.432 | 1.210 | 3.356 | −2.443 | 1.270 | 3.356 | 0.420 | 1.367 | 3.356 |
| 0.338 | 1.185 | 3.356 | −2.441 | 1.276 | 3.356 | 0.511 | 1.377 | 3.356 |
| 0.240 | 1.160 | 3.356 | −2.436 | 1.281 | 3.356 | 0.597 | 1.387 | 3.356 |
| 0.138 | 1.135 | 3.356 | −2.429 | 1.286 | 3.356 | 0.681 | 1.397 | 3.356 |
| 0.032 | 1.111 | 3.356 | −2.419 | 1.290 | 3.356 | 0.760 | 1.407 | 3.356 |
| −0.078 | 1.087 | 3.356 | −2.404 | 1.293 | 3.356 | 0.832 | 1.417 | 3.356 |
| −0.188 | 1.065 | 3.356 | −2.386 | 1.296 | 3.356 | 0.897 | 1.426 | 3.356 |
| −0.298 | 1.045 | 3.356 | −2.362 | 1.297 | 3.356 | 0.955 | 1.434 | 3.356 |
| −0.409 | 1.027 | 3.356 | −2.333 | 1.298 | 3.356 | 1.009 | 1.442 | 3.356 |
| −0.521 | 1.012 | 3.356 | −2.299 | 1.299 | 3.356 | 1.056 | 1.449 | 3.356 |
| −0.632 | 0.999 | 3.356 | −2.259 | 1.298 | 3.356 | 1.092 | 1.454 | 3.356 |
| −0.744 | 0.989 | 3.356 | −2.212 | 1.297 | 3.356 | 1.121 | 1.458 | 3.356 |
| −0.856 | 0.982 | 3.356 | −2.157 | 1.296 | 3.356 | 1.142 | 1.462 | 3.356 |
| −0.968 | 0.978 | 3.356 | −2.095 | 1.294 | 3.356 | 1.158 | 1.460 | 3.356 |
| −1.081 | 0.977 | 3.356 | −2.026 | 1.291 | 3.356 | 1.166 | 1.455 | 3.356 |
| −1.193 | 0.979 | 3.356 | −1.950 | 1.289 | 3.356 | 1.169 | 1.450 | 3.356 |
| −1.305 | 0.983 | 3.356 | −1.866 | 1.286 | 3.356 | 1.170 | 1.448 | 3.356 |
| −1.413 | 0.990 | 3.356 | −1.779 | 1.284 | 3.356 | 1.171 | 1.446 | 3.356 |
| −1.517 | 1.000 | 3.356 | −1.688 | 1.282 | 3.356 | 1.171 | 1.445 | 3.356 |
| −1.618 | 1.012 | 3.356 | −1.593 | 1.280 | 3.356 | | | |
| −1.714 | 1.025 | 3.356 | −1.495 | 1.279 | 3.356 | | | |
| 1.124 | 1.479 | 4.027 | −1.801 | 1.077 | 4.027 | −1.396 | 1.312 | 4.027 |
| 1.125 | 1.477 | 4.027 | −1.887 | 1.094 | 4.027 | −1.292 | 1.312 | 4.027 |
| 1.125 | 1.474 | 4.027 | −1.970 | 1.112 | 4.027 | −1.185 | 1.314 | 4.027 |
| 1.124 | 1.468 | 4.027 | −2.044 | 1.130 | 4.027 | −1.077 | 1.315 | 4.027 |
| 1.119 | 1.460 | 4.027 | −2.112 | 1.148 | 4.027 | −0.970 | 1.318 | 4.027 |
| 1.105 | 1.452 | 4.027 | −2.172 | 1.166 | 4.027 | −0.863 | 1.321 | 4.027 |
| 1.084 | 1.446 | 4.027 | −2.224 | 1.183 | 4.027 | −0.755 | 1.324 | 4.027 |
| 1.056 | 1.437 | 4.027 | −2.269 | 1.199 | 4.027 | −0.648 | 1.328 | 4.027 |
| 1.021 | 1.426 | 4.027 | −2.307 | 1.214 | 4.027 | −0.541 | 1.333 | 4.027 |
| 0.975 | 1.412 | 4.027 | −2.339 | 1.228 | 4.027 | −0.434 | 1.338 | 4.027 |
| 0.922 | 1.396 | 4.027 | −2.365 | 1.240 | 4.027 | −0.327 | 1.343 | 4.027 |
| 0.866 | 1.379 | 4.027 | −2.386 | 1.252 | 4.027 | −0.220 | 1.350 | 4.027 |
| 0.802 | 1.360 | 4.027 | −2.403 | 1.262 | 4.027 | −0.113 | 1.357 | 4.027 |
| 0.732 | 1.340 | 4.027 | −2.414 | 1.271 | 4.027 | −0.006 | 1.364 | 4.027 |
| 0.654 | 1.317 | 4.027 | −2.422 | 1.280 | 4.027 | 0.098 | 1.373 | 4.027 |

TABLE 3S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.572 | 1.294 | 4.027 | −2.427 | 1.287 | 4.027 | 0.198 | 1.382 | 4.027 |
| 0.487 | 1.270 | 4.027 | −2.429 | 1.295 | 4.027 | 0.294 | 1.391 | 4.027 |
| 0.399 | 1.246 | 4.027 | −2.429 | 1.300 | 4.027 | 0.386 | 1.400 | 4.027 |
| 0.306 | 1.221 | 4.027 | −2.427 | 1.305 | 4.027 | 0.475 | 1.410 | 4.027 |
| 0.210 | 1.196 | 4.027 | −2.422 | 1.311 | 4.027 | 0.561 | 1.420 | 4.027 |
| 0.110 | 1.172 | 4.027 | −2.414 | 1.315 | 4.027 | 0.642 | 1.431 | 4.027 |
| 0.006 | 1.148 | 4.027 | −2.405 | 1.319 | 4.027 | 0.721 | 1.441 | 4.027 |
| −0.102 | 1.124 | 4.027 | −2.391 | 1.323 | 4.027 | 0.792 | 1.451 | 4.027 |
| −0.210 | 1.103 | 4.027 | −2.372 | 1.326 | 4.027 | 0.855 | 1.460 | 4.027 |
| −0.318 | 1.083 | 4.027 | −2.349 | 1.327 | 4.027 | 0.912 | 1.468 | 4.027 |
| −0.427 | 1.066 | 4.027 | −2.321 | 1.328 | 4.027 | 0.965 | 1.476 | 4.027 |
| −0.537 | 1.051 | 4.027 | −2.287 | 1.329 | 4.027 | 1.011 | 1.483 | 4.027 |
| −0.646 | 1.038 | 4.027 | −2.248 | 1.329 | 4.027 | 1.047 | 1.488 | 4.027 |
| −0.756 | 1.028 | 4.027 | −2.201 | 1.328 | 4.027 | 1.075 | 1.492 | 4.027 |
| −0.866 | 1.021 | 4.027 | −2.148 | 1.327 | 4.027 | 1.096 | 1.496 | 4.027 |
| −0.977 | 1.017 | 4.027 | −2.087 | 1.325 | 4.027 | 1.112 | 1.494 | 4.027 |
| −1.087 | 1.015 | 4.027 | −2.019 | 1.323 | 4.027 | 1.119 | 1.489 | 4.027 |
| −1.198 | 1.017 | 4.027 | −1.944 | 1.321 | 4.027 | 1.122 | 1.484 | 4.027 |
| −1.308 | 1.021 | 4.027 | −1.861 | 1.318 | 4.027 | 1.124 | 1.482 | 4.027 |
| −1.414 | 1.028 | 4.027 | −1.775 | 1.316 | 4.027 | 1.124 | 1.480 | 4.027 |
| −1.517 | 1.038 | 4.027 | −1.686 | 1.315 | 4.027 | 1.124 | 1.479 | 4.027 |
| −1.616 | 1.049 | 4.027 | −1.593 | 1.313 | 4.027 | | | |
| −1.710 | 1.062 | 4.027 | −1.496 | 1.312 | 4.027 | | | |
| 1.127 | 1.403 | 5.369 | −1.706 | 1.036 | 5.369 | −1.314 | 1.272 | 5.369 |
| 1.127 | 1.401 | 5.369 | −1.789 | 1.052 | 5.369 | −1.213 | 1.272 | 5.369 |
| 1.128 | 1.398 | 5.369 | −1.869 | 1.071 | 5.369 | −1.109 | 1.273 | 5.369 |
| 1.127 | 1.393 | 5.369 | −1.941 | 1.089 | 5.369 | −1.005 | 1.274 | 5.369 |
| 1.123 | 1.385 | 5.369 | −2.006 | 1.107 | 5.369 | −0.901 | 1.276 | 5.369 |
| 1.109 | 1.376 | 5.369 | −2.064 | 1.125 | 5.369 | −0.798 | 1.278 | 5.369 |
| 1.089 | 1.370 | 5.369 | −2.115 | 1.142 | 5.369 | −0.694 | 1.280 | 5.369 |
| 1.061 | 1.362 | 5.369 | −2.159 | 1.158 | 5.369 | −0.590 | 1.283 | 5.369 |
| 1.027 | 1.352 | 5.369 | −2.195 | 1.172 | 5.369 | −0.486 | 1.286 | 5.369 |
| 0.983 | 1.338 | 5.369 | −2.226 | 1.186 | 5.369 | −0.382 | 1.290 | 5.369 |
| 0.932 | 1.323 | 5.369 | −2.251 | 1.198 | 5.369 | −0.279 | 1.294 | 5.369 |
| 0.877 | 1.307 | 5.369 | −2.272 | 1.210 | 5.369 | −0.175 | 1.298 | 5.369 |
| 0.815 | 1.289 | 5.369 | −2.287 | 1.220 | 5.369 | −0.071 | 1.304 | 5.369 |
| 0.747 | 1.269 | 5.369 | −2.298 | 1.229 | 5.369 | 0.033 | 1.310 | 5.369 |
| 0.671 | 1.248 | 5.369 | −2.306 | 1.237 | 5.369 | 0.133 | 1.316 | 5.369 |
| 0.593 | 1.226 | 5.369 | −2.311 | 1.244 | 5.369 | 0.229 | 1.323 | 5.369 |
| 0.510 | 1.203 | 5.369 | −2.313 | 1.251 | 5.369 | 0.323 | 1.331 | 5.369 |
| 0.424 | 1.180 | 5.369 | −2.313 | 1.257 | 5.369 | 0.412 | 1.339 | 5.369 |
| 0.334 | 1.157 | 5.369 | −2.311 | 1.261 | 5.369 | 0.499 | 1.347 | 5.369 |
| 0.241 | 1.134 | 5.369 | −2.306 | 1.267 | 5.369 | 0.581 | 1.355 | 5.369 |
| 0.144 | 1.110 | 5.369 | −2.299 | 1.271 | 5.369 | 0.661 | 1.364 | 5.369 |
| 0.043 | 1.088 | 5.369 | −2.290 | 1.275 | 5.369 | 0.736 | 1.373 | 5.369 |
| −0.061 | 1.066 | 5.369 | −2.276 | 1.279 | 5.369 | 0.805 | 1.381 | 5.369 |
| −0.166 | 1.046 | 5.369 | −2.258 | 1.282 | 5.369 | 0.867 | 1.389 | 5.369 |
| −0.271 | 1.027 | 5.369 | −2.236 | 1.284 | 5.369 | 0.922 | 1.396 | 5.369 |
| −0.377 | 1.011 | 5.369 | −2.209 | 1.285 | 5.369 | 0.974 | 1.403 | 5.369 |
| −0.482 | 0.997 | 5.369 | −2.176 | 1.286 | 5.369 | 1.018 | 1.409 | 5.369 |
| −0.589 | 0.986 | 5.369 | −2.138 | 1.286 | 5.369 | 1.053 | 1.413 | 5.369 |
| −0.695 | 0.978 | 5.369 | −2.093 | 1.286 | 5.369 | 1.080 | 1.417 | 5.369 |
| −0.802 | 0.972 | 5.369 | −2.041 | 1.285 | 5.369 | 1.101 | 1.420 | 5.369 |
| −0.909 | 0.969 | 5.369 | −1.982 | 1.284 | 5.369 | 1.116 | 1.418 | 5.369 |
| −1.016 | 0.969 | 5.369 | −1.916 | 1.282 | 5.369 | 1.123 | 1.413 | 5.369 |
| −1.123 | 0.972 | 5.369 | −1.844 | 1.281 | 5.369 | 1.126 | 1.408 | 5.369 |
| −1.230 | 0.977 | 5.369 | −1.764 | 1.279 | 5.369 | 1.127 | 1.405 | 5.369 |
| −1.333 | 0.985 | 5.369 | −1.681 | 1.277 | 5.369 | 1.127 | 1.404 | 5.369 |
| −1.432 | 0.995 | 5.369 | −1.594 | 1.275 | 5.369 | 1.127 | 1.403 | 5.369 |
| −1.527 | 1.007 | 5.369 | −1.504 | 1.273 | 5.369 | | | |
| −1.618 | 1.020 | 5.369 | −1.411 | 1.272 | 5.369 | | | |
| 1.246 | 1.176 | 6.711 | −1.512 | 0.874 | 6.711 | −1.129 | 1.081 | 6.711 |
| 1.247 | 1.175 | 6.711 | −1.593 | 0.891 | 6.711 | −1.031 | 1.079 | 6.711 |
| 1.247 | 1.172 | 6.711 | −1.670 | 0.910 | 6.711 | −0.930 | 1.077 | 6.711 |
| 1.246 | 1.166 | 6.711 | −1.740 | 0.928 | 6.711 | −0.829 | 1.076 | 6.711 |
| 1.242 | 1.159 | 6.711 | −1.803 | 0.946 | 6.711 | −0.728 | 1.076 | 6.711 |
| 1.229 | 1.150 | 6.711 | −1.859 | 0.964 | 6.711 | −0.627 | 1.076 | 6.711 |
| 1.209 | 1.145 | 6.711 | −1.908 | 0.981 | 6.711 | −0.526 | 1.077 | 6.711 |
| 1.183 | 1.137 | 6.711 | −1.951 | 0.997 | 6.711 | −0.425 | 1.078 | 6.711 |
| 1.149 | 1.128 | 6.711 | −1.986 | 1.011 | 6.711 | −0.324 | 1.079 | 6.711 |
| 1.106 | 1.115 | 6.711 | −2.016 | 1.024 | 6.711 | −0.223 | 1.081 | 6.711 |
| 1.056 | 1.101 | 6.711 | −2.041 | 1.036 | 6.711 | −0.122 | 1.084 | 6.711 |
| 1.003 | 1.086 | 6.711 | −2.061 | 1.046 | 6.711 | −0.021 | 1.087 | 6.711 |
| 0.942 | 1.070 | 6.711 | −2.076 | 1.056 | 6.711 | 0.080 | 1.091 | 6.711 |
| 0.876 | 1.052 | 6.711 | −2.087 | 1.064 | 6.711 | 0.181 | 1.096 | 6.711 |
| 0.802 | 1.033 | 6.711 | −2.095 | 1.072 | 6.711 | 0.279 | 1.102 | 6.711 |
| 0.725 | 1.012 | 6.711 | −2.100 | 1.079 | 6.711 | 0.373 | 1.107 | 6.711 |

TABLE 3S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.644 | 0.992 | 6.711 | −2.102 | 1.086 | 6.711 | 0.464 | 1.114 | 6.711 |
| 0.560 | 0.971 | 6.711 | −2.102 | 1.091 | 6.711 | 0.551 | 1.121 | 6.711 |
| 0.473 | 0.950 | 6.711 | −2.100 | 1.095 | 6.711 | 0.635 | 1.128 | 6.711 |
| 0.382 | 0.928 | 6.711 | −2.095 | 1.100 | 6.711 | 0.716 | 1.135 | 6.711 |
| 0.287 | 0.908 | 6.711 | −2.088 | 1.104 | 6.711 | 0.793 | 1.143 | 6.711 |
| 0.189 | 0.888 | 6.711 | −2.078 | 1.108 | 6.711 | 0.867 | 1.151 | 6.711 |
| 0.087 | 0.868 | 6.711 | −2.065 | 1.111 | 6.711 | 0.934 | 1.158 | 6.711 |
| −0.015 | 0.851 | 6.711 | −2.048 | 1.113 | 6.711 | 0.994 | 1.166 | 6.711 |
| −0.118 | 0.835 | 6.711 | −2.026 | 1.114 | 6.711 | 1.047 | 1.172 | 6.711 |
| −0.221 | 0.822 | 6.711 | −1.999 | 1.114 | 6.711 | 1.097 | 1.178 | 6.711 |
| −0.324 | 0.811 | 6.711 | −1.968 | 1.114 | 6.711 | 1.141 | 1.184 | 6.711 |
| −0.428 | 0.803 | 6.711 | −1.931 | 1.113 | 6.711 | 1.174 | 1.188 | 6.711 |
| −0.531 | 0.797 | 6.711 | −1.887 | 1.112 | 6.711 | 1.201 | 1.191 | 6.711 |
| −0.635 | 0.794 | 6.711 | −1.836 | 1.110 | 6.711 | 1.221 | 1.194 | 6.711 |
| −0.739 | 0.794 | 6.711 | −1.779 | 1.107 | 6.711 | 1.236 | 1.191 | 6.711 |
| −0.843 | 0.796 | 6.711 | −1.715 | 1.104 | 6.711 | 1.242 | 1.186 | 6.711 |
| −0.946 | 0.801 | 6.711 | −1.644 | 1.100 | 6.711 | 1.245 | 1.181 | 6.711 |
| −1.050 | 0.809 | 6.711 | −1.567 | 1.096 | 6.711 | 1.246 | 1.179 | 6.711 |
| −1.150 | 0.818 | 6.711 | −1.486 | 1.093 | 6.711 | 1.246 | 1.177 | 6.711 |
| −1.246 | 0.830 | 6.711 | −1.402 | 1.089 | 6.711 | 1.246 | 1.177 | 6.711 |
| −1.338 | 0.843 | 6.711 | −1.314 | 1.086 | 6.711 | | | |
| −1.427 | 0.858 | 6.711 | −1.223 | 1.083 | 6.711 | | | |
| 1.446 | 0.828 | 8.053 | −1.258 | 0.643 | 8.053 | −0.886 | 0.763 | 8.053 |
| 1.446 | 0.827 | 8.053 | −1.337 | 0.661 | 8.053 | −0.790 | 0.756 | 8.053 |
| 1.446 | 0.824 | 8.053 | −1.412 | 0.679 | 8.053 | −0.691 | 0.750 | 8.053 |
| 1.445 | 0.818 | 8.053 | −1.481 | 0.698 | 8.053 | −0.591 | 0.745 | 8.053 |
| 1.441 | 0.811 | 8.053 | −1.543 | 0.715 | 8.053 | −0.492 | 0.741 | 8.053 |
| 1.428 | 0.803 | 8.053 | −1.597 | 0.732 | 8.053 | −0.393 | 0.738 | 8.053 |
| 1.408 | 0.798 | 8.053 | −1.646 | 0.748 | 8.053 | −0.294 | 0.736 | 8.053 |
| 1.382 | 0.792 | 8.053 | −1.687 | 0.762 | 8.053 | −0.195 | 0.735 | 8.053 |
| 1.349 | 0.784 | 8.053 | −1.722 | 0.775 | 8.053 | −0.096 | 0.734 | 8.053 |
| 1.306 | 0.774 | 8.053 | −1.752 | 0.786 | 8.053 | 0.004 | 0.735 | 8.053 |
| 1.257 | 0.763 | 8.053 | −1.776 | 0.797 | 8.053 | 0.103 | 0.736 | 8.053 |
| 1.204 | 0.751 | 8.053 | −1.796 | 0.806 | 8.053 | 0.202 | 0.739 | 8.053 |
| 1.145 | 0.737 | 8.053 | −1.812 | 0.814 | 8.053 | 0.301 | 0.742 | 8.053 |
| 1.079 | 0.723 | 8.053 | −1.823 | 0.821 | 8.053 | 0.400 | 0.746 | 8.053 |
| 1.007 | 0.707 | 8.053 | −1.831 | 0.827 | 8.053 | 0.496 | 0.751 | 8.053 |
| 0.931 | 0.691 | 8.053 | −1.837 | 0.834 | 8.053 | 0.588 | 0.757 | 8.053 |
| 0.851 | 0.675 | 8.053 | −1.840 | 0.840 | 8.053 | 0.677 | 0.764 | 8.053 |
| 0.768 | 0.659 | 8.053 | −1.840 | 0.845 | 8.053 | 0.763 | 0.771 | 8.053 |
| 0.682 | 0.642 | 8.053 | −1.837 | 0.849 | 8.053 | 0.845 | 0.778 | 8.053 |
| 0.592 | 0.626 | 8.053 | −1.832 | 0.853 | 8.053 | 0.924 | 0.786 | 8.053 |
| 0.499 | 0.611 | 8.053 | −1.824 | 0.856 | 8.053 | 1.000 | 0.793 | 8.053 |
| 0.402 | 0.596 | 8.053 | −1.815 | 0.858 | 8.053 | 1.073 | 0.802 | 8.053 |
| 0.302 | 0.583 | 8.053 | −1.801 | 0.859 | 8.053 | 1.139 | 0.809 | 8.053 |
| 0.201 | 0.571 | 8.053 | −1.784 | 0.858 | 8.053 | 1.198 | 0.817 | 8.053 |
| 0.101 | 0.561 | 8.053 | −1.763 | 0.857 | 8.053 | 1.250 | 0.823 | 8.053 |
| 0.000 | 0.553 | 8.053 | −1.737 | 0.855 | 8.053 | 1.300 | 0.829 | 8.053 |
| −0.101 | 0.547 | 8.053 | −1.706 | 0.851 | 8.053 | 1.342 | 0.835 | 8.053 |
| −0.203 | 0.544 | 8.053 | −1.669 | 0.847 | 8.053 | 1.375 | 0.839 | 8.053 |
| −0.304 | 0.543 | 8.053 | −1.627 | 0.842 | 8.053 | 1.401 | 0.843 | 8.053 |
| −0.405 | 0.544 | 8.053 | −1.577 | 0.835 | 8.053 | 1.421 | 0.846 | 8.053 |
| −0.506 | 0.547 | 8.053 | −1.522 | 0.828 | 8.053 | 1.436 | 0.843 | 8.053 |
| −0.607 | 0.553 | 8.053 | −1.459 | 0.820 | 8.053 | 1.442 | 0.838 | 8.053 |
| −0.708 | 0.561 | 8.053 | −1.390 | 0.812 | 8.053 | 1.444 | 0.833 | 8.053 |
| −0.809 | 0.571 | 8.053 | −1.314 | 0.803 | 8.053 | 1.445 | 0.831 | 8.053 |
| −0.906 | 0.583 | 8.053 | −1.235 | 0.794 | 8.053 | 1.445 | 0.829 | 8.053 |
| −0.999 | 0.596 | 8.053 | −1.153 | 0.786 | 8.053 | 1.446 | 0.829 | 8.053 |
| −1.089 | 0.611 | 8.053 | −1.067 | 0.778 | 8.053 | | | |
| −1.175 | 0.626 | 8.053 | −0.978 | 0.770 | 8.053 | | | |
| 1.684 | 0.409 | 9.396 | −0.972 | 0.366 | 9.396 | −0.610 | 0.419 | 9.396 |
| 1.684 | 0.408 | 9.396 | −1.049 | 0.386 | 9.396 | −0.516 | 0.406 | 9.396 |
| 1.684 | 0.405 | 9.396 | −1.122 | 0.407 | 9.396 | −0.419 | 0.394 | 9.396 |
| 1.683 | 0.400 | 9.396 | −1.189 | 0.427 | 9.396 | −0.322 | 0.384 | 9.396 |
| 1.679 | 0.393 | 9.396 | −1.249 | 0.447 | 9.396 | −0.225 | 0.374 | 9.396 |
| 1.666 | 0.386 | 9.396 | −1.302 | 0.465 | 9.396 | −0.127 | 0.366 | 9.396 |
| 1.646 | 0.382 | 9.396 | −1.349 | 0.481 | 9.396 | −0.030 | 0.359 | 9.396 |
| 1.620 | 0.377 | 9.396 | −1.389 | 0.496 | 9.396 | 0.068 | 0.353 | 9.396 |
| 1.588 | 0.370 | 9.396 | −1.423 | 0.509 | 9.396 | 0.166 | 0.348 | 9.396 |
| 1.546 | 0.362 | 9.396 | −1.452 | 0.521 | 9.396 | 0.263 | 0.345 | 9.396 |
| 1.497 | 0.353 | 9.396 | −1.476 | 0.531 | 9.396 | 0.361 | 0.343 | 9.396 |
| 1.445 | 0.344 | 9.396 | −1.496 | 0.540 | 9.396 | 0.458 | 0.342 | 9.396 |
| 1.386 | 0.333 | 9.396 | −1.511 | 0.547 | 9.396 | 0.556 | 0.342 | 9.396 |
| 1.321 | 0.322 | 9.396 | −1.523 | 0.554 | 9.396 | 0.653 | 0.344 | 9.396 |
| 1.249 | 0.310 | 9.396 | −1.531 | 0.560 | 9.396 | 0.748 | 0.347 | 9.396 |
| 1.174 | 0.298 | 9.396 | −1.536 | 0.566 | 9.396 | 0.839 | 0.351 | 9.396 |
| 1.095 | 0.285 | 9.396 | −1.539 | 0.572 | 9.396 | 0.927 | 0.355 | 9.396 |

TABLE 3S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.013 | 0.273 | 9.396 | −1.539 | 0.577 | 9.396 | 1.011 | 0.361 | 9.396 |
| 0.928 | 0.262 | 9.396 | −1.537 | 0.581 | 9.396 | 1.093 | 0.367 | 9.396 |
| 0.839 | 0.251 | 9.396 | −1.531 | 0.584 | 9.396 | 1.171 | 0.373 | 9.396 |
| 0.747 | 0.241 | 9.396 | −1.523 | 0.586 | 9.396 | 1.245 | 0.380 | 9.396 |
| 0.652 | 0.232 | 9.396 | −1.513 | 0.586 | 9.396 | 1.317 | 0.387 | 9.396 |
| 0.553 | 0.224 | 9.396 | −1.500 | 0.585 | 9.396 | 1.381 | 0.394 | 9.396 |
| 0.454 | 0.218 | 9.396 | −1.483 | 0.583 | 9.396 | 1.440 | 0.401 | 9.396 |
| 0.355 | 0.214 | 9.396 | −1.463 | 0.579 | 9.396 | 1.492 | 0.407 | 9.396 |
| 0.255 | 0.212 | 9.396 | −1.437 | 0.574 | 9.396 | 1.540 | 0.412 | 9.396 |
| 0.156 | 0.213 | 9.396 | −1.407 | 0.568 | 9.396 | 1.582 | 0.417 | 9.396 |
| 0.057 | 0.215 | 9.396 | −1.372 | 0.560 | 9.396 | 1.615 | 0.421 | 9.396 |
| −0.042 | 0.220 | 9.396 | −1.331 | 0.551 | 9.396 | 1.640 | 0.425 | 9.396 |
| −0.142 | 0.227 | 9.396 | −1.283 | 0.541 | 9.396 | 1.660 | 0.427 | 9.396 |
| −0.240 | 0.235 | 9.396 | −1.229 | 0.529 | 9.396 | 1.674 | 0.424 | 9.396 |
| −0.339 | 0.246 | 9.396 | −1.168 | 0.516 | 9.396 | 1.680 | 0.419 | 9.396 |
| −0.437 | 0.259 | 9.396 | −1.101 | 0.503 | 9.396 | 1.682 | 0.414 | 9.396 |
| −0.535 | 0.274 | 9.396 | −1.028 | 0.488 | 9.396 | 1.683 | 0.412 | 9.396 |
| −0.630 | 0.291 | 9.396 | −0.951 | 0.474 | 9.396 | 1.684 | 0.410 | 9.396 |
| −0.721 | 0.308 | 9.396 | −0.870 | 0.460 | 9.396 | 1.684 | 0.410 | 9.396 |
| −0.808 | 0.326 | 9.396 | −0.787 | 0.446 | 9.396 | | | |
| −0.892 | 0.346 | 9.396 | −0.700 | 0.432 | 9.396 | | | |
| 1.841 | 0.177 | 10.067 | −0.830 | 0.214 | 10.067 | −0.464 | 0.250 | 10.067 |
| 1.842 | 0.176 | 10.067 | −0.906 | 0.238 | 10.067 | −0.370 | 0.233 | 10.067 |
| 1.841 | 0.173 | 10.067 | −0.978 | 0.263 | 10.067 | −0.273 | 0.217 | 10.067 |
| 1.840 | 0.168 | 10.067 | −1.044 | 0.287 | 10.067 | −0.176 | 0.203 | 10.067 |
| 1.836 | 0.161 | 10.067 | −1.104 | 0.309 | 10.067 | −0.078 | 0.190 | 10.067 |
| 1.823 | 0.154 | 10.067 | −1.157 | 0.330 | 10.067 | 0.019 | 0.178 | 10.067 |
| 1.803 | 0.150 | 10.067 | −1.203 | 0.349 | 10.067 | 0.117 | 0.167 | 10.067 |
| 1.777 | 0.146 | 10.067 | −1.243 | 0.366 | 10.067 | 0.215 | 0.158 | 10.067 |
| 1.744 | 0.140 | 10.067 | −1.276 | 0.381 | 10.067 | 0.313 | 0.150 | 10.067 |
| 1.702 | 0.132 | 10.067 | −1.305 | 0.394 | 10.067 | 0.411 | 0.143 | 10.067 |
| 1.652 | 0.124 | 10.067 | −1.329 | 0.406 | 10.067 | 0.509 | 0.138 | 10.067 |
| 1.600 | 0.115 | 10.067 | −1.348 | 0.415 | 10.067 | 0.607 | 0.134 | 10.067 |
| 1.540 | 0.105 | 10.067 | −1.363 | 0.424 | 10.067 | 0.705 | 0.132 | 10.067 |
| 1.474 | 0.094 | 10.067 | −1.374 | 0.431 | 10.067 | 0.804 | 0.131 | 10.067 |
| 1.402 | 0.083 | 10.067 | −1.382 | 0.438 | 10.067 | 0.899 | 0.131 | 10.067 |
| 1.326 | 0.072 | 10.067 | −1.388 | 0.444 | 10.067 | 0.990 | 0.133 | 10.067 |
| 1.246 | 0.061 | 10.067 | −1.391 | 0.450 | 10.067 | 1.079 | 0.136 | 10.067 |
| 1.163 | 0.050 | 10.067 | −1.390 | 0.455 | 10.067 | 1.164 | 0.140 | 10.067 |
| 1.077 | 0.040 | 10.067 | −1.387 | 0.459 | 10.067 | 1.246 | 0.144 | 10.067 |
| 0.987 | 0.031 | 10.067 | −1.381 | 0.461 | 10.067 | 1.324 | 0.149 | 10.067 |
| 0.894 | 0.022 | 10.067 | −1.373 | 0.463 | 10.067 | 1.400 | 0.155 | 10.067 |
| 0.798 | 0.016 | 10.067 | −1.363 | 0.462 | 10.067 | 1.471 | 0.161 | 10.067 |
| 0.698 | 0.010 | 10.067 | −1.350 | 0.461 | 10.067 | 1.537 | 0.167 | 10.067 |
| 0.598 | 0.007 | 10.067 | −1.334 | 0.457 | 10.067 | 1.596 | 0.172 | 10.067 |
| 0.498 | 0.007 | 10.067 | −1.313 | 0.452 | 10.067 | 1.648 | 0.177 | 10.067 |
| 0.397 | 0.008 | 10.067 | −1.288 | 0.445 | 10.067 | 1.697 | 0.182 | 10.067 |
| 0.297 | 0.012 | 10.067 | −1.258 | 0.437 | 10.067 | 1.739 | 0.187 | 10.067 |
| 0.198 | 0.018 | 10.067 | −1.223 | 0.428 | 10.067 | 1.772 | 0.190 | 10.067 |
| 0.098 | 0.026 | 10.067 | −1.182 | 0.417 | 10.067 | 1.798 | 0.193 | 10.067 |
| −0.002 | 0.037 | 10.067 | −1.135 | 0.404 | 10.067 | 1.817 | 0.196 | 10.067 |
| −0.101 | 0.050 | 10.067 | −1.081 | 0.390 | 10.067 | 1.832 | 0.193 | 10.067 |
| −0.200 | 0.065 | 10.067 | −1.021 | 0.374 | 10.067 | 1.838 | 0.187 | 10.067 |
| −0.298 | 0.082 | 10.067 | −0.954 | 0.357 | 10.067 | 1.840 | 0.182 | 10.067 |
| −0.396 | 0.101 | 10.067 | −0.881 | 0.339 | 10.067 | 1.841 | 0.180 | 10.067 |
| −0.490 | 0.122 | 10.067 | −0.804 | 0.320 | 10.067 | 1.841 | 0.179 | 10.067 |
| −0.580 | 0.144 | 10.067 | −0.724 | 0.302 | 10.067 | 1.841 | 0.178 | 10.067 |
| −0.667 | 0.166 | 10.067 | −0.641 | 0.284 | 10.067 | | | |
| −0.750 | 0.190 | 10.067 | −0.554 | 0.267 | 10.067 | | | |
| 2.201 | −0.259 | 11.238 | −0.606 | −0.089 | 11.238 | −0.213 | −0.081 | 11.238 |
| 2.201 | −0.261 | 11.238 | −0.682 | −0.053 | 11.238 | −0.116 | −0.106 | 11.238 |
| 2.201 | −0.263 | 11.238 | −0.755 | −0.017 | 11.238 | −0.016 | −0.129 | 11.238 |
| 2.200 | −0.269 | 11.238 | −0.820 | 0.017 | 11.238 | 0.085 | −0.151 | 11.238 |
| 2.195 | −0.276 | 11.238 | −0.879 | 0.049 | 11.238 | 0.187 | −0.171 | 11.238 |
| 2.181 | −0.283 | 11.238 | −0.931 | 0.079 | 11.238 | 0.289 | −0.188 | 11.238 |
| 2.160 | −0.286 | 11.238 | −0.977 | 0.107 | 11.238 | 0.391 | −0.204 | 11.238 |
| 2.132 | −0.292 | 11.238 | −1.016 | 0.131 | 11.238 | 0.493 | −0.218 | 11.238 |
| 2.097 | −0.298 | 11.238 | −1.048 | 0.153 | 11.238 | 0.596 | −0.230 | 11.238 |
| 2.052 | −0.306 | 11.238 | −1.076 | 0.171 | 11.238 | 0.698 | −0.241 | 11.238 |
| 1.999 | −0.315 | 11.238 | −1.099 | 0.188 | 11.238 | 0.801 | −0.251 | 11.238 |
| 1.944 | −0.324 | 11.238 | −1.117 | 0.201 | 11.238 | 0.904 | −0.259 | 11.238 |
| 1.881 | −0.334 | 11.238 | −1.132 | 0.212 | 11.238 | 1.007 | −0.266 | 11.238 |
| 1.811 | −0.344 | 11.238 | −1.142 | 0.222 | 11.238 | 1.110 | −0.271 | 11.238 |
| 1.734 | −0.356 | 11.238 | −1.149 | 0.230 | 11.238 | 1.209 | −0.275 | 11.238 |
| 1.653 | −0.366 | 11.238 | −1.154 | 0.237 | 11.238 | 1.305 | −0.277 | 11.238 |
| 1.569 | −0.377 | 11.238 | −1.157 | 0.244 | 11.238 | 1.398 | −0.277 | 11.238 |
| 1.481 | −0.387 | 11.238 | −1.156 | 0.249 | 11.238 | 1.488 | −0.277 | 11.238 |

TABLE 3S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.389 | −0.396 | 11.238 | −1.152 | 0.253 | 11.238 | 1.574 | −0.276 | 11.238 |
| 1.294 | −0.404 | 11.238 | −1.145 | 0.254 | 11.238 | 1.656 | −0.274 | 11.238 |
| 1.196 | −0.411 | 11.238 | −1.136 | 0.253 | 11.238 | 1.736 | −0.271 | 11.238 |
| 1.093 | −0.416 | 11.238 | −1.126 | 0.251 | 11.238 | 1.811 | −0.267 | 11.238 |
| 0.987 | −0.418 | 11.238 | −1.113 | 0.247 | 11.238 | 1.880 | −0.263 | 11.238 |
| 0.881 | −0.418 | 11.238 | −1.097 | 0.240 | 11.238 | 1.942 | −0.259 | 11.238 |
| 0.775 | −0.415 | 11.238 | −1.076 | 0.231 | 11.238 | 1.997 | −0.255 | 11.238 |
| 0.669 | −0.409 | 11.238 | −1.051 | 0.220 | 11.238 | 2.049 | −0.251 | 11.238 |
| 0.564 | −0.400 | 11.238 | −1.021 | 0.207 | 11.238 | 2.094 | −0.248 | 11.238 |
| 0.458 | −0.389 | 11.238 | −0.987 | 0.191 | 11.238 | 2.128 | −0.245 | 11.238 |
| 0.353 | −0.375 | 11.238 | −0.945 | 0.174 | 11.238 | 2.155 | −0.243 | 11.238 |
| 0.249 | −0.357 | 11.238 | −0.898 | 0.153 | 11.238 | 2.176 | −0.241 | 11.238 |
| 0.145 | −0.336 | 11.238 | −0.844 | 0.131 | 11.238 | 2.191 | −0.243 | 11.238 |
| 0.041 | −0.313 | 11.238 | −0.783 | 0.107 | 11.238 | 2.198 | −0.249 | 11.238 |
| −0.061 | −0.286 | 11.238 | −0.715 | 0.081 | 11.238 | 2.200 | −0.254 | 11.238 |
| −0.163 | −0.256 | 11.238 | −0.641 | 0.053 | 11.238 | 2.201 | −0.256 | 11.238 |
| −0.260 | −0.225 | 11.238 | −0.563 | 0.026 | 11.238 | 2.201 | −0.258 | 11.238 |
| −0.352 | −0.192 | 11.238 | −0.481 | −0.001 | 11.238 | 2.201 | −0.258 | 11.238 |
| −0.441 | −0.159 | 11.238 | −0.395 | −0.028 | 11.238 | | | |
| −0.525 | −0.124 | 11.238 | −0.306 | −0.055 | 11.238 | | | |

The coordinate values given in TABLE 4S below provide the nominal profile envelope for an exemplary forth stage stator.

TABLE 4S

| X-LOC | Y-LOC | Z-LOC | X-LOC | Y-LOC | Z-LOC | X-LOC | Y-LOC | Z-LOC |
|---|---|---|---|---|---|---|---|---|
| 2.354 | −0.036 | 0.000 | −1.018 | −0.113 | 0.000 | −0.512 | 0.109 | 0.000 |
| 2.355 | −0.038 | 0.000 | −1.113 | −0.076 | 0.000 | −0.395 | 0.094 | 0.000 |
| 2.355 | −0.041 | 0.000 | −1.202 | −0.038 | 0.000 | −0.274 | 0.080 | 0.000 |
| 2.354 | −0.048 | 0.000 | −1.282 | 0.000 | 0.000 | −0.152 | 0.067 | 0.000 |
| 2.350 | −0.057 | 0.000 | −1.354 | 0.036 | 0.000 | −0.031 | 0.054 | 0.000 |
| 2.335 | −0.069 | 0.000 | −1.417 | 0.070 | 0.000 | 0.091 | 0.043 | 0.000 |
| 2.310 | −0.076 | 0.000 | −1.472 | 0.102 | 0.000 | 0.213 | 0.032 | 0.000 |
| 2.277 | −0.084 | 0.000 | −1.519 | 0.131 | 0.000 | 0.334 | 0.022 | 0.000 |
| 2.236 | −0.095 | 0.000 | −1.558 | 0.158 | 0.000 | 0.456 | 0.012 | 0.000 |
| 2.183 | −0.109 | 0.000 | −1.590 | 0.182 | 0.000 | 0.578 | 0.002 | 0.000 |
| 2.121 | −0.124 | 0.000 | −1.616 | 0.203 | 0.000 | 0.699 | −0.008 | 0.000 |
| 2.055 | −0.140 | 0.000 | −1.636 | 0.221 | 0.000 | 0.821 | −0.016 | 0.000 |
| 1.981 | −0.158 | 0.000 | −1.652 | 0.237 | 0.000 | 0.943 | −0.023 | 0.000 |
| 1.898 | −0.178 | 0.000 | −1.664 | 0.250 | 0.000 | 1.065 | −0.029 | 0.000 |
| 1.807 | −0.198 | 0.000 | −1.671 | 0.260 | 0.000 | 1.183 | −0.034 | 0.000 |
| 1.712 | −0.219 | 0.000 | −1.675 | 0.270 | 0.000 | 1.297 | −0.037 | 0.000 |
| 1.612 | −0.240 | 0.000 | −1.677 | 0.278 | 0.000 | 1.407 | −0.039 | 0.000 |
| 1.508 | −0.260 | 0.000 | −1.675 | 0.285 | 0.000 | 1.513 | −0.040 | 0.000 |
| 1.400 | −0.280 | 0.000 | −1.672 | 0.290 | 0.000 | 1.614 | −0.040 | 0.000 |
| 1.287 | −0.299 | 0.000 | −1.665 | 0.294 | 0.000 | 1.712 | −0.038 | 0.000 |
| 1.169 | −0.316 | 0.000 | −1.655 | 0.297 | 0.000 | 1.806 | −0.036 | 0.000 |
| 1.047 | −0.332 | 0.000 | −1.643 | 0.299 | 0.000 | 1.895 | −0.033 | 0.000 |
| 0.921 | −0.345 | 0.000 | −1.627 | 0.300 | 0.000 | 1.977 | −0.030 | 0.000 |
| 0.794 | −0.355 | 0.000 | −1.606 | 0.299 | 0.000 | 2.050 | −0.026 | 0.000 |
| 0.668 | −0.363 | 0.000 | −1.580 | 0.297 | 0.000 | 2.115 | −0.023 | 0.000 |
| 0.541 | −0.367 | 0.000 | −1.548 | 0.293 | 0.000 | 2.176 | −0.019 | 0.000 |
| 0.413 | −0.367 | 0.000 | −1.510 | 0.287 | 0.000 | 2.229 | −0.016 | 0.000 |
| 0.286 | −0.364 | 0.000 | −1.466 | 0.280 | 0.000 | 2.270 | −0.013 | 0.000 |
| 0.159 | −0.357 | 0.000 | −1.413 | 0.270 | 0.000 | 2.302 | −0.011 | 0.000 |
| 0.033 | −0.347 | 0.000 | −1.354 | 0.258 | 0.000 | 2.326 | −0.009 | 0.000 |
| −0.093 | −0.334 | 0.000 | −1.286 | 0.245 | 0.000 | 2.343 | −0.016 | 0.000 |
| −0.219 | −0.316 | 0.000 | −1.210 | 0.229 | 0.000 | 2.350 | −0.024 | 0.000 |
| −0.345 | −0.296 | 0.000 | −1.126 | 0.213 | 0.000 | 2.353 | −0.029 | 0.000 |
| −0.470 | −0.271 | 0.000 | −1.034 | 0.195 | 0.000 | 2.354 | −0.033 | 0.000 |
| −0.589 | −0.244 | 0.000 | −0.938 | 0.177 | 0.000 | 2.354 | −0.034 | 0.000 |
| −0.704 | −0.215 | 0.000 | −0.838 | 0.159 | 0.000 | 2.354 | −0.035 | 0.000 |
| −0.814 | −0.183 | 0.000 | −0.733 | 0.142 | 0.000 | | | |
| −0.919 | −0.149 | 0.000 | −0.625 | 0.125 | 0.000 | | | |
| 2.009 | 0.433 | 0.941 | −1.112 | 0.186 | 0.941 | −0.669 | 0.434 | 0.941 |
| 2.009 | 0.431 | 0.941 | −1.202 | 0.209 | 0.941 | −0.559 | 0.430 | 0.941 |
| 2.009 | 0.428 | 0.941 | −1.289 | 0.232 | 0.941 | −0.445 | 0.427 | 0.941 |
| 2.008 | 0.422 | 0.941 | −1.367 | 0.256 | 0.941 | −0.331 | 0.425 | 0.941 |
| 2.004 | 0.413 | 0.941 | −1.437 | 0.279 | 0.941 | −0.217 | 0.423 | 0.941 |
| 1.991 | 0.402 | 0.941 | −1.499 | 0.302 | 0.941 | −0.104 | 0.422 | 0.941 |

TABLE 4S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.968 | 0.396 | 0.941 | −1.554 | 0.323 | 0.941 | 0.010 | 0.420 | 0.941 |
| 1.938 | 0.389 | 0.941 | −1.601 | 0.343 | 0.941 | 0.124 | 0.419 | 0.941 |
| 1.900 | 0.379 | 0.941 | −1.640 | 0.362 | 0.941 | 0.238 | 0.417 | 0.941 |
| 1.851 | 0.367 | 0.941 | −1.672 | 0.379 | 0.941 | 0.352 | 0.415 | 0.941 |
| 1.794 | 0.353 | 0.941 | −1.699 | 0.394 | 0.941 | 0.466 | 0.413 | 0.941 |
| 1.733 | 0.339 | 0.941 | −1.721 | 0.407 | 0.941 | 0.580 | 0.412 | 0.941 |
| 1.665 | 0.323 | 0.941 | −1.737 | 0.419 | 0.941 | 0.693 | 0.411 | 0.941 |
| 1.589 | 0.305 | 0.941 | −1.749 | 0.429 | 0.941 | 0.807 | 0.411 | 0.941 |
| 1.505 | 0.287 | 0.941 | −1.757 | 0.438 | 0.941 | 0.917 | 0.411 | 0.941 |
| 1.417 | 0.267 | 0.941 | −1.763 | 0.446 | 0.941 | 1.024 | 0.412 | 0.941 |
| 1.325 | 0.248 | 0.941 | −1.765 | 0.454 | 0.941 | 1.126 | 0.414 | 0.941 |
| 1.230 | 0.228 | 0.941 | −1.764 | 0.460 | 0.941 | 1.225 | 0.416 | 0.941 |
| 1.130 | 0.209 | 0.941 | −1.762 | 0.465 | 0.941 | 1.320 | 0.419 | 0.941 |
| 1.026 | 0.190 | 0.941 | −1.757 | 0.470 | 0.941 | 1.411 | 0.422 | 0.941 |
| 0.919 | 0.171 | 0.941 | −1.748 | 0.475 | 0.941 | 1.498 | 0.426 | 0.941 |
| 0.807 | 0.153 | 0.941 | −1.737 | 0.478 | 0.941 | 1.581 | 0.430 | 0.941 |
| 0.691 | 0.135 | 0.941 | −1.722 | 0.481 | 0.941 | 1.657 | 0.435 | 0.941 |
| 0.575 | 0.120 | 0.941 | −1.703 | 0.483 | 0.941 | 1.725 | 0.439 | 0.941 |
| 0.459 | 0.106 | 0.941 | −1.678 | 0.485 | 0.941 | 1.786 | 0.443 | 0.941 |
| 0.342 | 0.095 | 0.941 | −1.648 | 0.486 | 0.941 | 1.843 | 0.447 | 0.941 |
| 0.226 | 0.086 | 0.941 | −1.613 | 0.485 | 0.941 | 1.892 | 0.451 | 0.941 |
| 0.109 | 0.079 | 0.941 | −1.571 | 0.484 | 0.941 | 1.930 | 0.454 | 0.941 |
| −0.008 | 0.076 | 0.941 | −1.522 | 0.482 | 0.941 | 1.960 | 0.456 | 0.941 |
| −0.125 | 0.075 | 0.941 | −1.465 | 0.479 | 0.941 | 1.983 | 0.457 | 0.941 |
| −0.242 | 0.078 | 0.941 | −1.400 | 0.475 | 0.941 | 1.998 | 0.451 | 0.941 |
| −0.359 | 0.083 | 0.941 | −1.328 | 0.470 | 0.941 | 2.004 | 0.444 | 0.941 |
| −0.476 | 0.090 | 0.941 | −1.249 | 0.465 | 0.941 | 2.007 | 0.439 | 0.941 |
| −0.592 | 0.101 | 0.941 | −1.162 | 0.459 | 0.941 | 2.008 | 0.436 | 0.941 |
| −0.705 | 0.114 | 0.941 | −1.071 | 0.453 | 0.941 | 2.008 | 0.434 | 0.941 |
| −0.813 | 0.129 | 0.941 | −0.976 | 0.448 | 0.941 | 2.009 | 0.434 | 0.941 |
| −0.917 | 0.146 | 0.941 | −0.878 | 0.443 | 0.941 | | | |
| −1.016 | 0.165 | 0.941 | −0.775 | 0.438 | 0.941 | | | |
| 1.725 | 0.859 | 1.882 | −1.290 | 0.588 | 1.882 | −0.870 | 0.811 | 1.882 |
| 1.725 | 0.857 | 1.882 | −1.379 | 0.607 | 1.882 | −0.763 | 0.809 | 1.882 |
| 1.725 | 0.854 | 1.882 | −1.463 | 0.626 | 1.882 | −0.653 | 0.808 | 1.882 |
| 1.724 | 0.848 | 1.882 | −1.539 | 0.646 | 1.882 | −0.543 | 0.808 | 1.882 |
| 1.720 | 0.840 | 1.882 | −1.608 | 0.666 | 1.882 | −0.432 | 0.809 | 1.882 |
| 1.706 | 0.830 | 1.882 | −1.669 | 0.685 | 1.882 | −0.322 | 0.810 | 1.882 |
| 1.684 | 0.825 | 1.882 | −1.722 | 0.704 | 1.882 | −0.212 | 0.810 | 1.882 |
| 1.655 | 0.818 | 1.882 | −1.768 | 0.721 | 1.882 | −0.101 | 0.811 | 1.882 |
| 1.618 | 0.809 | 1.882 | −1.807 | 0.736 | 1.882 | 0.009 | 0.812 | 1.882 |
| 1.570 | 0.797 | 1.882 | −1.839 | 0.751 | 1.882 | 0.119 | 0.812 | 1.882 |
| 1.515 | 0.784 | 1.882 | −1.866 | 0.764 | 1.882 | 0.230 | 0.813 | 1.882 |
| 1.457 | 0.771 | 1.882 | −1.887 | 0.776 | 1.882 | 0.340 | 0.814 | 1.882 |
| 1.391 | 0.755 | 1.882 | −1.904 | 0.786 | 1.882 | 0.450 | 0.816 | 1.882 |
| 1.317 | 0.739 | 1.882 | −1.916 | 0.795 | 1.882 | 0.560 | 0.818 | 1.882 |
| 1.236 | 0.721 | 1.882 | −1.925 | 0.803 | 1.882 | 0.667 | 0.820 | 1.882 |
| 1.152 | 0.702 | 1.882 | −1.930 | 0.810 | 1.882 | 0.770 | 0.823 | 1.882 |
| 1.063 | 0.684 | 1.882 | −1.933 | 0.817 | 1.882 | 0.869 | 0.826 | 1.882 |
| 0.971 | 0.665 | 1.882 | −1.933 | 0.823 | 1.882 | 0.965 | 0.830 | 1.882 |
| 0.875 | 0.645 | 1.882 | −1.930 | 0.828 | 1.882 | 1.057 | 0.835 | 1.882 |
| 0.775 | 0.626 | 1.882 | −1.925 | 0.833 | 1.882 | 1.145 | 0.839 | 1.882 |
| 0.671 | 0.608 | 1.882 | −1.917 | 0.837 | 1.882 | 1.229 | 0.844 | 1.882 |
| 0.564 | 0.590 | 1.882 | −1.906 | 0.841 | 1.882 | 1.310 | 0.850 | 1.882 |
| 0.452 | 0.572 | 1.882 | −1.892 | 0.843 | 1.882 | 1.383 | 0.855 | 1.882 |
| 0.340 | 0.557 | 1.882 | −1.873 | 0.845 | 1.882 | 1.449 | 0.860 | 1.882 |
| 0.228 | 0.543 | 1.882 | −1.849 | 0.846 | 1.882 | 1.508 | 0.865 | 1.882 |
| 0.116 | 0.531 | 1.882 | −1.820 | 0.847 | 1.882 | 1.563 | 0.870 | 1.882 |
| 0.003 | 0.521 | 1.882 | −1.785 | 0.847 | 1.882 | 1.611 | 0.874 | 1.882 |
| −0.110 | 0.513 | 1.882 | −1.745 | 0.845 | 1.882 | 1.647 | 0.877 | 1.882 |
| −0.223 | 0.508 | 1.882 | −1.697 | 0.844 | 1.882 | 1.677 | 0.880 | 1.882 |
| −0.336 | 0.506 | 1.882 | −1.642 | 0.841 | 1.882 | 1.699 | 0.882 | 1.882 |
| −0.449 | 0.506 | 1.882 | −1.580 | 0.838 | 1.882 | 1.714 | 0.877 | 1.882 |
| −0.562 | 0.508 | 1.882 | −1.510 | 0.834 | 1.882 | 1.720 | 0.870 | 1.882 |
| −0.674 | 0.513 | 1.882 | −1.433 | 0.830 | 1.882 | 1.723 | 0.865 | 1.882 |
| −0.787 | 0.521 | 1.882 | −1.348 | 0.826 | 1.882 | 1.724 | 0.862 | 1.882 |
| −0.896 | 0.530 | 1.882 | −1.260 | 0.822 | 1.882 | 1.724 | 0.861 | 1.882 |
| −1.000 | 0.542 | 1.882 | −1.168 | 0.818 | 1.882 | 1.724 | 0.860 | 1.882 |
| −1.101 | 0.556 | 1.882 | −1.072 | 0.815 | 1.882 | | | |
| −1.198 | 0.571 | 1.882 | −0.973 | 0.813 | 1.882 | | | |
| 1.461 | 1.266 | 3.137 | −1.470 | 1.019 | 3.137 | −1.065 | 1.209 | 3.137 |
| 1.461 | 1.265 | 3.137 | −1.556 | 1.036 | 3.137 | −0.961 | 1.207 | 3.137 |
| 1.461 | 1.262 | 3.137 | −1.638 | 1.054 | 3.137 | −0.854 | 1.207 | 3.137 |
| 1.460 | 1.256 | 3.137 | −1.713 | 1.072 | 3.137 | −0.746 | 1.207 | 3.137 |
| 1.455 | 1.248 | 3.137 | −1.780 | 1.090 | 3.137 | −0.639 | 1.207 | 3.137 |
| 1.441 | 1.240 | 3.137 | −1.839 | 1.107 | 3.137 | −0.532 | 1.208 | 3.137 |
| 1.419 | 1.235 | 3.137 | −1.891 | 1.124 | 3.137 | −0.424 | 1.210 | 3.137 |

TABLE 4S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.391 | 1.229 | 3.137 | −1.936 | 1.139 | 3.137 | −0.317 | 1.211 | 3.137 |
| 1.355 | 1.221 | 3.137 | −1.974 | 1.153 | 3.137 | −0.210 | 1.212 | 3.137 |
| 1.309 | 1.210 | 3.137 | −2.006 | 1.166 | 3.137 | −0.102 | 1.213 | 3.137 |
| 1.255 | 1.198 | 3.137 | −2.032 | 1.178 | 3.137 | 0.005 | 1.215 | 3.137 |
| 1.198 | 1.186 | 3.137 | −2.054 | 1.189 | 3.137 | 0.113 | 1.216 | 3.137 |
| 1.134 | 1.172 | 3.137 | −2.071 | 1.198 | 3.137 | 0.220 | 1.219 | 3.137 |
| 1.062 | 1.157 | 3.137 | −2.083 | 1.206 | 3.137 | 0.327 | 1.221 | 3.137 |
| 0.984 | 1.141 | 3.137 | −2.091 | 1.213 | 3.137 | 0.431 | 1.224 | 3.137 |
| 0.901 | 1.124 | 3.137 | −2.097 | 1.221 | 3.137 | 0.531 | 1.227 | 3.137 |
| 0.815 | 1.107 | 3.137 | −2.100 | 1.227 | 3.137 | 0.628 | 1.231 | 3.137 |
| 0.725 | 1.089 | 3.137 | −2.099 | 1.233 | 3.137 | 0.721 | 1.235 | 3.137 |
| 0.632 | 1.072 | 3.137 | −2.097 | 1.238 | 3.137 | 0.810 | 1.240 | 3.137 |
| 0.535 | 1.055 | 3.137 | −2.092 | 1.242 | 3.137 | 0.896 | 1.245 | 3.137 |
| 0.434 | 1.038 | 3.137 | −2.084 | 1.246 | 3.137 | 0.978 | 1.250 | 3.137 |
| 0.329 | 1.021 | 3.137 | −2.073 | 1.249 | 3.137 | 1.057 | 1.255 | 3.137 |
| 0.221 | 1.005 | 3.137 | −2.059 | 1.251 | 3.137 | 1.128 | 1.261 | 3.137 |
| 0.112 | 0.991 | 3.137 | −2.041 | 1.252 | 3.137 | 1.192 | 1.266 | 3.137 |
| 0.003 | 0.978 | 3.137 | −2.017 | 1.253 | 3.137 | 1.249 | 1.270 | 3.137 |
| −0.106 | 0.967 | 3.137 | −1.989 | 1.252 | 3.137 | 1.303 | 1.275 | 3.137 |
| −0.215 | 0.958 | 3.137 | −1.955 | 1.251 | 3.137 | 1.349 | 1.279 | 3.137 |
| −0.324 | 0.951 | 3.137 | −1.916 | 1.249 | 3.137 | 1.385 | 1.282 | 3.137 |
| −0.434 | 0.946 | 3.137 | −1.870 | 1.247 | 3.137 | 1.413 | 1.285 | 3.137 |
| −0.544 | 0.944 | 3.137 | −1.816 | 1.244 | 3.137 | 1.435 | 1.287 | 3.137 |
| −0.653 | 0.944 | 3.137 | −1.755 | 1.240 | 3.137 | 1.450 | 1.283 | 3.137 |
| −0.763 | 0.946 | 3.137 | −1.687 | 1.235 | 3.137 | 1.456 | 1.277 | 3.137 |
| −0.872 | 0.951 | 3.137 | −1.612 | 1.231 | 3.137 | 1.459 | 1.272 | 3.137 |
| −0.981 | 0.958 | 3.137 | −1.530 | 1.226 | 3.137 | 1.460 | 1.269 | 3.137 |
| −1.087 | 0.966 | 3.137 | −1.444 | 1.221 | 3.137 | 1.460 | 1.268 | 3.137 |
| −1.188 | 0.977 | 3.137 | −1.355 | 1.217 | 3.137 | 1.460 | 1.267 | 3.137 |
| −1.286 | 0.989 | 3.137 | −1.262 | 1.214 | 3.137 | | | |
| −1.380 | 1.003 | 3.137 | −1.165 | 1.211 | 3.137 | | | |
| 1.395 | 1.365 | 3.765 | −1.509 | 1.142 | 3.765 | −1.107 | 1.321 | 3.765 |
| 1.395 | 1.363 | 3.765 | −1.594 | 1.159 | 3.765 | −1.004 | 1.318 | 3.765 |
| 1.395 | 1.360 | 3.765 | −1.675 | 1.177 | 3.765 | −0.898 | 1.317 | 3.765 |
| 1.393 | 1.355 | 3.765 | −1.749 | 1.196 | 3.765 | −0.792 | 1.316 | 3.765 |
| 1.389 | 1.347 | 3.765 | −1.815 | 1.214 | 3.765 | −0.685 | 1.316 | 3.765 |
| 1.374 | 1.340 | 3.765 | −1.874 | 1.231 | 3.765 | −0.579 | 1.317 | 3.765 |
| 1.353 | 1.335 | 3.765 | −1.925 | 1.248 | 3.765 | −0.473 | 1.317 | 3.765 |
| 1.325 | 1.329 | 3.765 | −1.970 | 1.263 | 3.765 | −0.366 | 1.318 | 3.765 |
| 1.289 | 1.321 | 3.765 | −2.007 | 1.277 | 3.765 | −0.260 | 1.319 | 3.765 |
| 1.243 | 1.311 | 3.765 | −2.039 | 1.290 | 3.765 | −0.154 | 1.320 | 3.765 |
| 1.190 | 1.300 | 3.765 | −2.065 | 1.302 | 3.765 | −0.047 | 1.321 | 3.765 |
| 1.134 | 1.288 | 3.765 | −2.086 | 1.312 | 3.765 | 0.059 | 1.322 | 3.765 |
| 1.070 | 1.275 | 3.765 | −2.103 | 1.321 | 3.765 | 0.165 | 1.324 | 3.765 |
| 0.999 | 1.261 | 3.765 | −2.115 | 1.330 | 3.765 | 0.272 | 1.326 | 3.765 |
| 0.921 | 1.245 | 3.765 | −2.123 | 1.337 | 3.765 | 0.374 | 1.328 | 3.765 |
| 0.839 | 1.230 | 3.765 | −2.129 | 1.344 | 3.765 | 0.474 | 1.331 | 3.765 |
| 0.754 | 1.213 | 3.765 | −2.131 | 1.351 | 3.765 | 0.569 | 1.334 | 3.765 |
| 0.665 | 1.197 | 3.765 | −2.131 | 1.356 | 3.765 | 0.661 | 1.338 | 3.765 |
| 0.572 | 1.180 | 3.765 | −2.129 | 1.361 | 3.765 | 0.750 | 1.342 | 3.765 |
| 0.476 | 1.164 | 3.765 | −2.123 | 1.365 | 3.765 | 0.835 | 1.346 | 3.765 |
| 0.376 | 1.148 | 3.765 | −2.115 | 1.369 | 3.765 | 0.916 | 1.351 | 3.765 |
| 0.272 | 1.132 | 3.765 | −2.105 | 1.372 | 3.765 | 0.994 | 1.356 | 3.765 |
| 0.165 | 1.117 | 3.765 | −2.091 | 1.374 | 3.765 | 1.065 | 1.361 | 3.765 |
| 0.057 | 1.104 | 3.765 | −2.073 | 1.375 | 3.765 | 1.128 | 1.365 | 3.765 |
| −0.051 | 1.092 | 3.765 | −2.050 | 1.375 | 3.765 | 1.185 | 1.370 | 3.765 |
| −0.159 | 1.082 | 3.765 | −2.022 | 1.374 | 3.765 | 1.238 | 1.374 | 3.765 |
| −0.267 | 1.073 | 3.765 | −1.988 | 1.372 | 3.765 | 1.284 | 1.377 | 3.765 |
| −0.375 | 1.067 | 3.765 | −1.949 | 1.370 | 3.765 | 1.319 | 1.380 | 3.765 |
| −0.484 | 1.064 | 3.765 | −1.903 | 1.366 | 3.765 | 1.348 | 1.383 | 3.765 |
| −0.592 | 1.062 | 3.765 | −1.850 | 1.362 | 3.765 | 1.369 | 1.385 | 3.765 |
| −0.701 | 1.063 | 3.765 | −1.790 | 1.358 | 3.765 | 1.384 | 1.381 | 3.765 |
| −0.809 | 1.066 | 3.765 | −1.723 | 1.353 | 3.765 | 1.391 | 1.375 | 3.765 |
| −0.917 | 1.071 | 3.765 | −1.649 | 1.347 | 3.765 | 1.393 | 1.370 | 3.765 |
| −1.026 | 1.079 | 3.765 | −1.567 | 1.342 | 3.765 | 1.394 | 1.368 | 3.765 |
| −1.130 | 1.088 | 3.765 | −1.483 | 1.337 | 3.765 | 1.394 | 1.366 | 3.765 |
| −1.230 | 1.099 | 3.765 | −1.394 | 1.332 | 3.765 | 1.394 | 1.366 | 3.765 |
| −1.327 | 1.112 | 3.765 | −1.302 | 1.327 | 3.765 | | | |
| −1.420 | 1.126 | 3.765 | −1.206 | 1.324 | 3.765 | | | |
| 1.409 | 1.321 | 5.020 | −1.453 | 1.163 | 5.020 | −1.054 | 1.324 | 5.020 |
| 1.410 | 1.320 | 5.020 | −1.536 | 1.182 | 5.020 | −0.953 | 1.320 | 5.020 |
| 1.409 | 1.317 | 5.020 | −1.616 | 1.203 | 5.020 | −0.848 | 1.316 | 5.020 |
| 1.408 | 1.312 | 5.020 | −1.688 | 1.223 | 5.020 | −0.743 | 1.313 | 5.020 |
| 1.403 | 1.304 | 5.020 | −1.753 | 1.242 | 5.020 | −0.639 | 1.310 | 5.020 |
| 1.389 | 1.298 | 5.020 | −1.810 | 1.261 | 5.020 | −0.534 | 1.309 | 5.020 |
| 1.368 | 1.294 | 5.020 | −1.860 | 1.279 | 5.020 | −0.430 | 1.307 | 5.020 |
| 1.340 | 1.288 | 5.020 | −1.904 | 1.296 | 5.020 | −0.325 | 1.306 | 5.020 |

TABLE 4S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.305 | 1.281 | 5.020 | −1.940 | 1.310 | 5.020 | −0.220 | 1.306 | 5.020 |
| 1.259 | 1.272 | 5.020 | −1.971 | 1.324 | 5.020 | −0.116 | 1.305 | 5.020 |
| 1.207 | 1.262 | 5.020 | −1.996 | 1.336 | 5.020 | −0.011 | 1.304 | 5.020 |
| 1.151 | 1.251 | 5.020 | −2.017 | 1.347 | 5.020 | 0.094 | 1.303 | 5.020 |
| 1.088 | 1.240 | 5.020 | −2.033 | 1.356 | 5.020 | 0.198 | 1.303 | 5.020 |
| 1.018 | 1.227 | 5.020 | −2.045 | 1.364 | 5.020 | 0.303 | 1.303 | 5.020 |
| 0.940 | 1.213 | 5.020 | −2.053 | 1.372 | 5.020 | 0.404 | 1.303 | 5.020 |
| 0.860 | 1.198 | 5.020 | −2.058 | 1.379 | 5.020 | 0.502 | 1.304 | 5.020 |
| 0.776 | 1.183 | 5.020 | −2.061 | 1.386 | 5.020 | 0.596 | 1.306 | 5.020 |
| 0.688 | 1.168 | 5.020 | −2.061 | 1.391 | 5.020 | 0.687 | 1.307 | 5.020 |
| 0.596 | 1.153 | 5.020 | −2.058 | 1.396 | 5.020 | 0.774 | 1.310 | 5.020 |
| 0.501 | 1.139 | 5.020 | −2.053 | 1.400 | 5.020 | 0.858 | 1.312 | 5.020 |
| 0.402 | 1.124 | 5.020 | −2.044 | 1.403 | 5.020 | 0.938 | 1.315 | 5.020 |
| 0.300 | 1.111 | 5.020 | −2.034 | 1.405 | 5.020 | 1.014 | 1.319 | 5.020 |
| 0.194 | 1.098 | 5.020 | −2.020 | 1.407 | 5.020 | 1.084 | 1.322 | 5.020 |
| 0.088 | 1.087 | 5.020 | −2.002 | 1.407 | 5.020 | 1.147 | 1.326 | 5.020 |
| −0.019 | 1.077 | 5.020 | −1.979 | 1.406 | 5.020 | 1.203 | 1.329 | 5.020 |
| −0.125 | 1.069 | 5.020 | −1.952 | 1.404 | 5.020 | 1.255 | 1.332 | 5.020 |
| −0.232 | 1.063 | 5.020 | −1.919 | 1.401 | 5.020 | 1.300 | 1.335 | 5.020 |
| −0.339 | 1.060 | 5.020 | −1.881 | 1.397 | 5.020 | 1.335 | 1.337 | 5.020 |
| −0.446 | 1.059 | 5.020 | −1.836 | 1.392 | 5.020 | 1.363 | 1.339 | 5.020 |
| −0.553 | 1.060 | 5.020 | −1.784 | 1.386 | 5.020 | 1.384 | 1.340 | 5.020 |
| −0.660 | 1.064 | 5.020 | −1.725 | 1.380 | 5.020 | 1.399 | 1.338 | 5.020 |
| −0.766 | 1.070 | 5.020 | −1.659 | 1.373 | 5.020 | 1.405 | 1.332 | 5.020 |
| −0.873 | 1.078 | 5.020 | −1.586 | 1.365 | 5.020 | 1.408 | 1.327 | 5.020 |
| −0.979 | 1.088 | 5.020 | −1.506 | 1.357 | 5.020 | 1.409 | 1.324 | 5.020 |
| −1.081 | 1.100 | 5.020 | −1.423 | 1.350 | 5.020 | 1.409 | 1.323 | 5.020 |
| −1.180 | 1.113 | 5.020 | −1.336 | 1.343 | 5.020 | 1.409 | 1.322 | 5.020 |
| −1.275 | 1.128 | 5.020 | −1.245 | 1.336 | 5.020 | | | |
| −1.366 | 1.145 | 5.020 | −1.151 | 1.330 | 5.020 | | | |
| 1.551 | 1.057 | 6.275 | −1.271 | 0.983 | 6.275 | −0.875 | 1.111 | 6.275 |
| 1.551 | 1.055 | 6.275 | −1.353 | 1.005 | 6.275 | −0.776 | 1.103 | 6.275 |
| 1.550 | 1.053 | 6.275 | −1.430 | 1.027 | 6.275 | −0.673 | 1.096 | 6.275 |
| 1.549 | 1.047 | 6.275 | −1.500 | 1.050 | 6.275 | −0.570 | 1.089 | 6.275 |
| 1.544 | 1.040 | 6.275 | −1.564 | 1.071 | 6.275 | −0.467 | 1.084 | 6.275 |
| 1.529 | 1.035 | 6.275 | −1.619 | 1.092 | 6.275 | −0.364 | 1.079 | 6.275 |
| 1.508 | 1.031 | 6.275 | −1.668 | 1.111 | 6.275 | −0.261 | 1.076 | 6.275 |
| 1.480 | 1.027 | 6.275 | −1.711 | 1.129 | 6.275 | −0.158 | 1.072 | 6.275 |
| 1.446 | 1.021 | 6.275 | −1.746 | 1.144 | 6.275 | −0.055 | 1.069 | 6.275 |
| 1.401 | 1.013 | 6.275 | −1.776 | 1.158 | 6.275 | 0.048 | 1.066 | 6.275 |
| 1.349 | 1.004 | 6.275 | −1.801 | 1.171 | 6.275 | 0.151 | 1.063 | 6.275 |
| 1.293 | 0.995 | 6.275 | −1.821 | 1.182 | 6.275 | 0.254 | 1.061 | 6.275 |
| 1.231 | 0.985 | 6.275 | −1.836 | 1.191 | 6.275 | 0.357 | 1.059 | 6.275 |
| 1.162 | 0.974 | 6.275 | −1.848 | 1.200 | 6.275 | 0.460 | 1.057 | 6.275 |
| 1.085 | 0.962 | 6.275 | −1.855 | 1.207 | 6.275 | 0.559 | 1.056 | 6.275 |
| 1.006 | 0.949 | 6.275 | −1.861 | 1.214 | 6.275 | 0.656 | 1.055 | 6.275 |
| 0.922 | 0.937 | 6.275 | −1.864 | 1.220 | 6.275 | 0.748 | 1.055 | 6.275 |
| 0.835 | 0.924 | 6.275 | −1.863 | 1.226 | 6.275 | 0.838 | 1.055 | 6.275 |
| 0.745 | 0.911 | 6.275 | −1.861 | 1.230 | 6.275 | 0.924 | 1.056 | 6.275 |
| 0.651 | 0.899 | 6.275 | −1.855 | 1.234 | 6.275 | 1.006 | 1.057 | 6.275 |
| 0.553 | 0.887 | 6.275 | −1.847 | 1.236 | 6.275 | 1.085 | 1.058 | 6.275 |
| 0.452 | 0.876 | 6.275 | −1.836 | 1.238 | 6.275 | 1.161 | 1.060 | 6.275 |
| 0.347 | 0.866 | 6.275 | −1.823 | 1.238 | 6.275 | 1.230 | 1.063 | 6.275 |
| 0.242 | 0.858 | 6.275 | −1.805 | 1.236 | 6.275 | 1.291 | 1.065 | 6.275 |
| 0.137 | 0.851 | 6.275 | −1.783 | 1.234 | 6.275 | 1.346 | 1.067 | 6.275 |
| 0.032 | 0.847 | 6.275 | −1.756 | 1.230 | 6.275 | 1.398 | 1.069 | 6.275 |
| −0.073 | 0.845 | 6.275 | −1.724 | 1.225 | 6.275 | 1.443 | 1.071 | 6.275 |
| −0.178 | 0.845 | 6.275 | −1.686 | 1.219 | 6.275 | 1.477 | 1.072 | 6.275 |
| −0.284 | 0.847 | 6.275 | −1.642 | 1.212 | 6.275 | 1.504 | 1.074 | 6.275 |
| −0.389 | 0.852 | 6.275 | −1.591 | 1.204 | 6.275 | 1.525 | 1.075 | 6.275 |
| −0.493 | 0.859 | 6.275 | −1.534 | 1.194 | 6.275 | 1.540 | 1.073 | 6.275 |
| −0.598 | 0.868 | 6.275 | −1.469 | 1.184 | 6.275 | 1.547 | 1.067 | 6.275 |
| −0.703 | 0.879 | 6.275 | −1.398 | 1.173 | 6.275 | 1.549 | 1.062 | 6.275 |
| −0.807 | 0.893 | 6.275 | −1.319 | 1.162 | 6.275 | 1.550 | 1.060 | 6.275 |
| −0.908 | 0.908 | 6.275 | −1.238 | 1.151 | 6.275 | 1.550 | 1.058 | 6.275 |
| −1.004 | 0.925 | 6.275 | −1.152 | 1.140 | 6.275 | 1.550 | 1.057 | 6.275 |
| −1.097 | 0.943 | 6.275 | −1.064 | 1.130 | 6.275 | | | |
| −1.186 | 0.962 | 6.275 | −0.971 | 1.120 | 6.275 | | | |
| 1.740 | 0.686 | 7.529 | −1.034 | 0.715 | 7.529 | −0.646 | 0.790 | 7.529 |
| 1.740 | 0.685 | 7.529 | −1.113 | 0.740 | 7.529 | −0.549 | 0.777 | 7.529 |
| 1.740 | 0.682 | 7.529 | −1.188 | 0.765 | 7.529 | −0.448 | 0.765 | 7.529 |
| 1.738 | 0.677 | 7.529 | −1.256 | 0.789 | 7.529 | −0.348 | 0.754 | 7.529 |
| 1.733 | 0.670 | 7.529 | −1.318 | 0.813 | 7.529 | −0.246 | 0.745 | 7.529 |
| 1.718 | 0.666 | 7.529 | −1.372 | 0.835 | 7.529 | −0.145 | 0.737 | 7.529 |
| 1.698 | 0.663 | 7.529 | −1.419 | 0.855 | 7.529 | −0.044 | 0.730 | 7.529 |
| 1.670 | 0.659 | 7.529 | −1.460 | 0.874 | 7.529 | 0.058 | 0.724 | 7.529 |
| 1.636 | 0.654 | 7.529 | −1.495 | 0.890 | 7.529 | 0.159 | 0.719 | 7.529 |

TABLE 4S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.592 | 0.648 | 7.529 | −1.524 | 0.905 | 7.529 | 0.260 | 0.714 | 7.529 |
| 1.540 | 0.641 | 7.529 | −1.548 | 0.917 | 7.529 | 0.362 | 0.709 | 7.529 |
| 1.486 | 0.634 | 7.529 | −1.567 | 0.928 | 7.529 | 0.463 | 0.705 | 7.529 |
| 1.424 | 0.626 | 7.529 | −1.583 | 0.938 | 7.529 | 0.565 | 0.701 | 7.529 |
| 1.356 | 0.617 | 7.529 | −1.594 | 0.946 | 7.529 | 0.666 | 0.698 | 7.529 |
| 1.280 | 0.608 | 7.529 | −1.602 | 0.953 | 7.529 | 0.764 | 0.696 | 7.529 |
| 1.202 | 0.598 | 7.529 | −1.607 | 0.960 | 7.529 | 0.859 | 0.694 | 7.529 |
| 1.119 | 0.589 | 7.529 | −1.610 | 0.966 | 7.529 | 0.950 | 0.692 | 7.529 |
| 1.034 | 0.579 | 7.529 | −1.609 | 0.971 | 7.529 | 1.038 | 0.692 | 7.529 |
| 0.944 | 0.570 | 7.529 | −1.606 | 0.975 | 7.529 | 1.123 | 0.691 | 7.529 |
| 0.852 | 0.562 | 7.529 | −1.600 | 0.978 | 7.529 | 1.204 | 0.692 | 7.529 |
| 0.755 | 0.554 | 7.529 | −1.592 | 0.979 | 7.529 | 1.282 | 0.692 | 7.529 |
| 0.656 | 0.547 | 7.529 | −1.582 | 0.979 | 7.529 | 1.356 | 0.693 | 7.529 |
| 0.552 | 0.541 | 7.529 | −1.568 | 0.978 | 7.529 | 1.424 | 0.695 | 7.529 |
| 0.449 | 0.537 | 7.529 | −1.551 | 0.975 | 7.529 | 1.485 | 0.696 | 7.529 |
| 0.346 | 0.534 | 7.529 | −1.529 | 0.970 | 7.529 | 1.539 | 0.698 | 7.529 |
| 0.242 | 0.533 | 7.529 | −1.503 | 0.964 | 7.529 | 1.590 | 0.700 | 7.529 |
| 0.139 | 0.535 | 7.529 | −1.472 | 0.956 | 7.529 | 1.634 | 0.701 | 7.529 |
| 0.035 | 0.539 | 7.529 | −1.436 | 0.947 | 7.529 | 1.668 | 0.702 | 7.529 |
| −0.068 | 0.545 | 7.529 | −1.394 | 0.936 | 7.529 | 1.695 | 0.703 | 7.529 |
| −0.171 | 0.553 | 7.529 | −1.344 | 0.924 | 7.529 | 1.715 | 0.704 | 7.529 |
| −0.274 | 0.564 | 7.529 | −1.288 | 0.911 | 7.529 | 1.730 | 0.702 | 7.529 |
| −0.377 | 0.576 | 7.529 | −1.226 | 0.896 | 7.529 | 1.737 | 0.696 | 7.529 |
| −0.479 | 0.591 | 7.529 | −1.156 | 0.880 | 7.529 | 1.739 | 0.692 | 7.529 |
| −0.581 | 0.609 | 7.529 | −1.080 | 0.864 | 7.529 | 1.740 | 0.689 | 7.529 |
| −0.680 | 0.627 | 7.529 | −1.000 | 0.848 | 7.529 | 1.740 | 0.688 | 7.529 |
| −0.774 | 0.648 | 7.529 | −0.917 | 0.833 | 7.529 | 1.740 | 0.687 | 7.529 |
| −0.864 | 0.669 | 7.529 | −0.830 | 0.818 | 7.529 | | | |
| −0.951 | 0.692 | 7.529 | −0.740 | 0.803 | 7.529 | | | |
| 1.984 | 0.223 | 8.784 | −0.780 | 0.416 | 8.784 | −0.393 | 0.447 | 8.784 |
| 1.984 | 0.222 | 8.784 | −0.856 | 0.446 | 8.784 | −0.297 | 0.428 | 8.784 |
| 1.984 | 0.219 | 8.784 | −0.929 | 0.476 | 8.784 | −0.197 | 0.409 | 8.784 |
| 1.982 | 0.214 | 8.784 | −0.996 | 0.506 | 8.784 | −0.097 | 0.393 | 8.784 |
| 1.976 | 0.208 | 8.784 | −1.055 | 0.534 | 8.784 | 0.003 | 0.377 | 8.784 |
| 1.961 | 0.204 | 8.784 | −1.108 | 0.560 | 8.784 | 0.104 | 0.363 | 8.784 |
| 1.940 | 0.202 | 8.784 | −1.154 | 0.584 | 8.784 | 0.204 | 0.350 | 8.784 |
| 1.912 | 0.200 | 8.784 | −1.193 | 0.605 | 8.784 | 0.305 | 0.338 | 8.784 |
| 1.878 | 0.197 | 8.784 | −1.226 | 0.624 | 8.784 | 0.406 | 0.328 | 8.784 |
| 1.833 | 0.193 | 8.784 | −1.254 | 0.641 | 8.784 | 0.507 | 0.318 | 8.784 |
| 1.782 | 0.188 | 8.784 | −1.278 | 0.655 | 8.784 | 0.608 | 0.308 | 8.784 |
| 1.727 | 0.183 | 8.784 | −1.297 | 0.667 | 8.784 | 0.709 | 0.299 | 8.784 |
| 1.665 | 0.178 | 8.784 | −1.312 | 0.677 | 8.784 | 0.810 | 0.290 | 8.784 |
| 1.596 | 0.173 | 8.784 | −1.322 | 0.686 | 8.784 | 0.912 | 0.282 | 8.784 |
| 1.520 | 0.167 | 8.784 | −1.330 | 0.693 | 8.784 | 1.009 | 0.275 | 8.784 |
| 1.441 | 0.162 | 8.784 | −1.335 | 0.700 | 8.784 | 1.104 | 0.269 | 8.784 |
| 1.358 | 0.156 | 8.784 | −1.337 | 0.707 | 8.784 | 1.195 | 0.263 | 8.784 |
| 1.272 | 0.151 | 8.784 | −1.337 | 0.712 | 8.784 | 1.283 | 0.259 | 8.784 |
| 1.182 | 0.146 | 8.784 | −1.333 | 0.716 | 8.784 | 1.367 | 0.255 | 8.784 |
| 1.089 | 0.143 | 8.784 | −1.327 | 0.717 | 8.784 | 1.449 | 0.252 | 8.784 |
| 0.993 | 0.140 | 8.784 | −1.318 | 0.718 | 8.784 | 1.526 | 0.249 | 8.784 |
| 0.892 | 0.139 | 8.784 | −1.308 | 0.716 | 8.784 | 1.601 | 0.247 | 8.784 |
| 0.789 | 0.139 | 8.784 | −1.295 | 0.713 | 8.784 | 1.669 | 0.245 | 8.784 |
| 0.685 | 0.141 | 8.784 | −1.278 | 0.708 | 8.784 | 1.729 | 0.244 | 8.784 |
| 0.582 | 0.144 | 8.784 | −1.257 | 0.701 | 8.784 | 1.784 | 0.244 | 8.784 |
| 0.479 | 0.150 | 8.784 | −1.232 | 0.692 | 8.784 | 1.834 | 0.243 | 8.784 |
| 0.375 | 0.159 | 8.784 | −1.202 | 0.681 | 8.784 | 1.878 | 0.242 | 8.784 |
| 0.272 | 0.169 | 8.784 | −1.167 | 0.669 | 8.784 | 1.912 | 0.242 | 8.784 |
| 0.170 | 0.182 | 8.784 | −1.126 | 0.654 | 8.784 | 1.939 | 0.242 | 8.784 |
| 0.067 | 0.197 | 8.784 | −1.078 | 0.637 | 8.784 | 1.960 | 0.242 | 8.784 |
| −0.035 | 0.214 | 8.784 | −1.023 | 0.619 | 8.784 | 1.974 | 0.239 | 8.784 |
| −0.137 | 0.233 | 8.784 | −0.962 | 0.599 | 8.784 | 1.981 | 0.234 | 8.784 |
| −0.238 | 0.254 | 8.784 | −0.894 | 0.577 | 8.784 | 1.983 | 0.229 | 8.784 |
| −0.338 | 0.278 | 8.784 | −0.820 | 0.554 | 8.784 | 1.984 | 0.226 | 8.784 |
| −0.434 | 0.303 | 8.784 | −0.741 | 0.532 | 8.784 | 1.984 | 0.225 | 8.784 |
| −0.526 | 0.330 | 8.784 | −0.660 | 0.510 | 8.784 | 1.984 | 0.224 | 8.784 |
| −0.615 | 0.358 | 8.784 | −0.574 | 0.488 | 8.784 | | | |
| −0.699 | 0.386 | 8.784 | −0.486 | 0.467 | 8.784 | | | |
| 2.136 | −0.038 | 9.412 | −0.669 | 0.290 | 9.412 | −0.272 | 0.294 | 9.412 |
| 2.135 | −0.039 | 9.412 | −0.745 | 0.326 | 9.412 | −0.175 | 0.269 | 9.412 |
| 2.135 | −0.042 | 9.412 | −0.817 | 0.362 | 9.412 | −0.074 | 0.244 | 9.412 |
| 2.133 | −0.047 | 9.412 | −0.882 | 0.397 | 9.412 | 0.027 | 0.222 | 9.412 |
| 2.126 | −0.053 | 9.412 | −0.940 | 0.430 | 9.412 | 0.128 | 0.201 | 9.412 |
| 2.111 | −0.056 | 9.412 | −0.992 | 0.460 | 9.412 | 0.229 | 0.182 | 9.412 |
| 2.090 | −0.057 | 9.412 | −1.037 | 0.488 | 9.412 | 0.331 | 0.164 | 9.412 |
| 2.061 | −0.058 | 9.412 | −1.075 | 0.513 | 9.412 | 0.433 | 0.148 | 9.412 |
| 2.026 | −0.060 | 9.412 | −1.108 | 0.534 | 9.412 | 0.535 | 0.133 | 9.412 |
| 1.980 | −0.062 | 9.412 | −1.135 | 0.553 | 9.412 | 0.637 | 0.118 | 9.412 |

TABLE 4S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.928 | −0.065 | 9.412 | −1.158 | 0.570 | 9.412 | 0.739 | 0.104 | 9.412 |
| 1.871 | −0.067 | 9.412 | −1.176 | 0.583 | 9.412 | 0.842 | 0.091 | 9.412 |
| 1.808 | −0.070 | 9.412 | −1.191 | 0.594 | 9.412 | 0.944 | 0.078 | 9.412 |
| 1.738 | −0.073 | 9.412 | −1.201 | 0.604 | 9.412 | 1.046 | 0.066 | 9.412 |
| 1.660 | −0.076 | 9.412 | −1.208 | 0.612 | 9.412 | 1.146 | 0.055 | 9.412 |
| 1.579 | −0.079 | 9.412 | −1.213 | 0.619 | 9.412 | 1.241 | 0.045 | 9.412 |
| 1.495 | −0.081 | 9.412 | −1.215 | 0.626 | 9.412 | 1.334 | 0.036 | 9.412 |
| 1.406 | −0.083 | 9.412 | −1.214 | 0.631 | 9.412 | 1.423 | 0.028 | 9.412 |
| 1.315 | −0.085 | 9.412 | −1.210 | 0.634 | 9.412 | 1.509 | 0.020 | 9.412 |
| 1.220 | −0.085 | 9.412 | −1.204 | 0.636 | 9.412 | 1.591 | 0.013 | 9.412 |
| 1.121 | −0.084 | 9.412 | −1.195 | 0.635 | 9.412 | 1.670 | 0.008 | 9.412 |
| 1.019 | −0.082 | 9.412 | −1.185 | 0.633 | 9.412 | 1.746 | 0.002 | 9.412 |
| 0.913 | −0.078 | 9.412 | −1.172 | 0.628 | 9.412 | 1.815 | −0.002 | 9.412 |
| 0.808 | −0.072 | 9.412 | −1.155 | 0.622 | 9.412 | 1.877 | −0.006 | 9.412 |
| 0.703 | −0.064 | 9.412 | −1.135 | 0.612 | 9.412 | 1.932 | −0.009 | 9.412 |
| 0.598 | −0.053 | 9.412 | −1.110 | 0.601 | 9.412 | 1.984 | −0.012 | 9.412 |
| 0.493 | −0.040 | 9.412 | −1.080 | 0.588 | 9.412 | 2.028 | −0.014 | 9.412 |
| 0.388 | −0.025 | 9.412 | −1.045 | 0.573 | 9.412 | 2.063 | −0.016 | 9.412 |
| 0.284 | −0.007 | 9.412 | −1.004 | 0.555 | 9.412 | 2.090 | −0.017 | 9.412 |
| 0.180 | 0.014 | 9.412 | −0.957 | 0.534 | 9.412 | 2.111 | −0.018 | 9.412 |
| 0.077 | 0.037 | 9.412 | −0.902 | 0.511 | 9.412 | 2.126 | −0.021 | 9.412 |
| −0.025 | 0.062 | 9.412 | −0.842 | 0.486 | 9.412 | 2.132 | −0.027 | 9.412 |
| −0.127 | 0.090 | 9.412 | −0.774 | 0.459 | 9.412 | 2.135 | −0.032 | 9.412 |
| −0.228 | 0.120 | 9.412 | −0.700 | 0.431 | 9.412 | 2.135 | −0.035 | 9.412 |
| −0.325 | 0.152 | 9.412 | −0.622 | 0.403 | 9.412 | 2.136 | −0.036 | 9.412 |
| −0.417 | 0.185 | 9.412 | −0.540 | 0.375 | 9.412 | 2.136 | −0.037 | 9.412 |
| −0.505 | 0.219 | 9.412 | −0.455 | 0.347 | 9.412 | | | |
| −0.589 | 0.254 | 9.412 | −0.365 | 0.320 | 9.412 | | | |
| 2.217 | −0.172 | 9.726 | −0.616 | 0.231 | 9.726 | −0.214 | 0.219 | 9.726 |
| 2.216 | −0.174 | 9.726 | −0.692 | 0.271 | 9.726 | −0.116 | 0.190 | 9.726 |
| 2.216 | −0.177 | 9.726 | −0.763 | 0.311 | 9.726 | −0.015 | 0.162 | 9.726 |
| 2.213 | −0.182 | 9.726 | −0.827 | 0.349 | 9.726 | 0.086 | 0.136 | 9.726 |
| 2.207 | −0.187 | 9.726 | −0.885 | 0.385 | 9.726 | 0.188 | 0.112 | 9.726 |
| 2.191 | −0.190 | 9.726 | −0.936 | 0.418 | 9.726 | 0.290 | 0.090 | 9.726 |
| 2.169 | −0.190 | 9.726 | −0.980 | 0.449 | 9.726 | 0.393 | 0.070 | 9.726 |
| 2.141 | −0.191 | 9.726 | −1.018 | 0.475 | 9.726 | 0.496 | 0.051 | 9.726 |
| 2.105 | −0.192 | 9.726 | −1.050 | 0.499 | 9.726 | 0.599 | 0.034 | 9.726 |
| 2.059 | −0.194 | 9.726 | −1.077 | 0.519 | 9.726 | 0.702 | 0.017 | 9.726 |
| 2.005 | −0.195 | 9.726 | −1.099 | 0.536 | 9.726 | 0.805 | 0.001 | 9.726 |
| 1.948 | −0.196 | 9.726 | −1.117 | 0.551 | 9.726 | 0.908 | −0.014 | 9.726 |
| 1.883 | −0.198 | 9.726 | −1.132 | 0.563 | 9.726 | 1.012 | −0.029 | 9.726 |
| 1.812 | −0.199 | 9.726 | −1.142 | 0.573 | 9.726 | 1.116 | −0.044 | 9.726 |
| 1.733 | −0.200 | 9.726 | −1.149 | 0.581 | 9.726 | 1.216 | −0.057 | 9.726 |
| 1.651 | −0.201 | 9.726 | −1.154 | 0.589 | 9.726 | 1.313 | −0.069 | 9.726 |
| 1.565 | −0.202 | 9.726 | −1.156 | 0.596 | 9.726 | 1.406 | −0.080 | 9.726 |
| 1.476 | −0.203 | 9.726 | −1.155 | 0.601 | 9.726 | 1.496 | −0.090 | 9.726 |
| 1.383 | −0.203 | 9.726 | −1.150 | 0.604 | 9.726 | 1.583 | −0.100 | 9.726 |
| 1.287 | −0.201 | 9.726 | −1.143 | 0.605 | 9.726 | 1.666 | −0.108 | 9.726 |
| 1.187 | −0.199 | 9.726 | −1.135 | 0.604 | 9.726 | 1.746 | −0.116 | 9.726 |
| 1.083 | −0.195 | 9.726 | −1.125 | 0.601 | 9.726 | 1.823 | −0.123 | 9.726 |
| 0.976 | −0.189 | 9.726 | −1.112 | 0.596 | 9.726 | 1.892 | −0.129 | 9.726 |
| 0.869 | −0.181 | 9.726 | −1.095 | 0.588 | 9.726 | 1.955 | −0.134 | 9.726 |
| 0.763 | −0.170 | 9.726 | −1.075 | 0.578 | 9.726 | 2.011 | −0.139 | 9.726 |
| 0.656 | −0.157 | 9.726 | −1.050 | 0.565 | 9.726 | 2.063 | −0.143 | 9.726 |
| 0.550 | −0.142 | 9.726 | −1.021 | 0.550 | 9.726 | 2.108 | −0.146 | 9.726 |
| 0.444 | −0.124 | 9.726 | −0.986 | 0.533 | 9.726 | 2.143 | −0.149 | 9.726 |
| 0.339 | −0.103 | 9.726 | −0.945 | 0.513 | 9.726 | 2.171 | −0.151 | 9.726 |
| 0.235 | −0.080 | 9.726 | −0.898 | 0.489 | 9.726 | 2.192 | −0.153 | 9.726 |
| 0.131 | −0.054 | 9.726 | −0.844 | 0.464 | 9.726 | 2.207 | −0.156 | 9.726 |
| 0.027 | −0.025 | 9.726 | −0.784 | 0.436 | 9.726 | 2.213 | −0.162 | 9.726 |
| −0.075 | 0.007 | 9.726 | −0.716 | 0.406 | 9.726 | 2.216 | −0.167 | 9.726 |
| −0.177 | 0.042 | 9.726 | −0.642 | 0.374 | 9.726 | 2.216 | −0.169 | 9.726 |
| −0.273 | 0.077 | 9.726 | −0.564 | 0.342 | 9.726 | 2.217 | −0.171 | 9.726 |
| −0.365 | 0.115 | 9.726 | −0.483 | 0.310 | 9.726 | 2.217 | −0.172 | 9.726 |
| −0.453 | 0.153 | 9.726 | −0.397 | 0.279 | 9.726 | | | |
| −0.537 | 0.192 | 9.726 | −0.307 | 0.249 | 9.726 | | | |

The coordinate values given in TABLE 5S below provide the nominal profile envelope for an exemplary fifth stage stator.

TABLE 5S

| X-LOC | Y-LOC | Z-LOC | X-LOC | Y-LOC | Z-LOC | X-LOC | Y-LOC | Z-LOC |
|---|---|---|---|---|---|---|---|---|
| 1.764 | −0.057 | 0.000 | −1.067 | −0.074 | 0.000 | −0.628 | 0.019 | 0.000 |
| 1.761 | −0.064 | 0.000 | −1.140 | −0.029 | 0.000 | −0.532 | −0.003 | 0.000 |
| 1.754 | −0.069 | 0.000 | −1.209 | 0.016 | 0.000 | −0.432 | −0.022 | 0.000 |
| 1.744 | −0.072 | 0.000 | −1.270 | 0.059 | 0.000 | −0.331 | −0.036 | 0.000 |
| 1.730 | −0.076 | 0.000 | −1.324 | 0.100 | 0.000 | −0.231 | −0.047 | 0.000 |
| 1.712 | −0.080 | 0.000 | −1.372 | 0.139 | 0.000 | −0.129 | −0.055 | 0.000 |
| 1.689 | −0.086 | 0.000 | −1.413 | 0.174 | 0.000 | −0.027 | −0.060 | 0.000 |
| 1.662 | −0.093 | 0.000 | −1.447 | 0.206 | 0.000 | 0.074 | −0.062 | 0.000 |
| 1.629 | −0.102 | 0.000 | −1.475 | 0.233 | 0.000 | 0.176 | −0.064 | 0.000 |
| 1.591 | −0.111 | 0.000 | −1.498 | 0.258 | 0.000 | 0.278 | −0.065 | 0.000 |
| 1.545 | −0.123 | 0.000 | −1.516 | 0.280 | 0.000 | 0.380 | −0.066 | 0.000 |
| 1.493 | −0.136 | 0.000 | −1.530 | 0.300 | 0.000 | 0.482 | −0.067 | 0.000 |
| 1.434 | −0.150 | 0.000 | −1.539 | 0.316 | 0.000 | 0.583 | −0.068 | 0.000 |
| 1.367 | −0.166 | 0.000 | −1.545 | 0.329 | 0.000 | 0.685 | −0.068 | 0.000 |
| 1.294 | −0.184 | 0.000 | −1.548 | 0.340 | 0.000 | 0.784 | −0.068 | 0.000 |
| 1.213 | −0.203 | 0.000 | −1.549 | 0.349 | 0.000 | 0.879 | −0.067 | 0.000 |
| 1.129 | −0.223 | 0.000 | −1.548 | 0.356 | 0.000 | 0.970 | −0.066 | 0.000 |
| 1.041 | −0.243 | 0.000 | −1.545 | 0.361 | 0.000 | 1.058 | −0.065 | 0.000 |
| 0.950 | −0.263 | 0.000 | −1.542 | 0.365 | 0.000 | 1.143 | −0.064 | 0.000 |
| 0.855 | −0.283 | 0.000 | −1.536 | 0.368 | 0.000 | 1.225 | −0.062 | 0.000 |
| 0.756 | −0.302 | 0.000 | −1.527 | 0.369 | 0.000 | 1.303 | −0.059 | 0.000 |
| 0.654 | −0.320 | 0.000 | −1.517 | 0.370 | 0.000 | 1.374 | −0.057 | 0.000 |
| 0.547 | −0.337 | 0.000 | −1.504 | 0.368 | 0.000 | 1.439 | −0.054 | 0.000 |
| 0.440 | −0.352 | 0.000 | −1.486 | 0.364 | 0.000 | 1.496 | −0.052 | 0.000 |
| 0.333 | −0.363 | 0.000 | −1.465 | 0.357 | 0.000 | 1.547 | −0.049 | 0.000 |
| 0.226 | −0.371 | 0.000 | −1.441 | 0.347 | 0.000 | 1.591 | −0.047 | 0.000 |
| 0.118 | −0.375 | 0.000 | −1.411 | 0.333 | 0.000 | 1.628 | −0.045 | 0.000 |
| 0.010 | −0.374 | 0.000 | −1.378 | 0.317 | 0.000 | 1.660 | −0.043 | 0.000 |
| −0.098 | −0.369 | 0.000 | −1.339 | 0.296 | 0.000 | 1.687 | −0.042 | 0.000 |
| −0.206 | −0.359 | 0.000 | −1.293 | 0.273 | 0.000 | 1.709 | −0.040 | 0.000 |
| −0.313 | −0.344 | 0.000 | −1.242 | 0.247 | 0.000 | 1.727 | −0.039 | 0.000 |
| −0.418 | −0.325 | 0.000 | −1.183 | 0.219 | 0.000 | 1.740 | −0.038 | 0.000 |
| −0.522 | −0.300 | 0.000 | −1.119 | 0.190 | 0.000 | 1.750 | −0.038 | 0.000 |
| −0.625 | −0.270 | 0.000 | −1.047 | 0.158 | 0.000 | 1.758 | −0.042 | 0.000 |
| −0.723 | −0.236 | 0.000 | −0.971 | 0.128 | 0.000 | 1.762 | −0.047 | 0.000 |
| −0.816 | −0.199 | 0.000 | −0.892 | 0.098 | 0.000 | 1.764 | −0.052 | 0.000 |
| −0.905 | −0.159 | 0.000 | −0.808 | 0.070 | 0.000 | | | |
| −0.988 | −0.117 | 0.000 | −0.720 | 0.043 | 0.000 | | | |
| 1.468 | 0.405 | 0.834 | −1.066 | 0.201 | 0.834 | −0.693 | 0.416 | 0.834 |
| 1.466 | 0.399 | 0.834 | −1.138 | 0.223 | 0.834 | −0.604 | 0.412 | 0.834 |
| 1.461 | 0.393 | 0.834 | −1.207 | 0.246 | 0.834 | −0.512 | 0.410 | 0.834 |
| 1.453 | 0.389 | 0.834 | −1.269 | 0.269 | 0.834 | −0.421 | 0.408 | 0.834 |
| 1.440 | 0.386 | 0.834 | −1.325 | 0.292 | 0.834 | −0.329 | 0.408 | 0.834 |
| 1.424 | 0.382 | 0.834 | −1.374 | 0.314 | 0.834 | −0.237 | 0.407 | 0.834 |
| 1.404 | 0.376 | 0.834 | −1.417 | 0.335 | 0.834 | −0.145 | 0.407 | 0.834 |
| 1.380 | 0.370 | 0.834 | −1.454 | 0.354 | 0.834 | −0.054 | 0.407 | 0.834 |
| 1.351 | 0.362 | 0.834 | −1.484 | 0.372 | 0.834 | 0.038 | 0.406 | 0.834 |
| 1.318 | 0.353 | 0.834 | −1.509 | 0.388 | 0.834 | 0.130 | 0.405 | 0.834 |
| 1.278 | 0.342 | 0.834 | −1.530 | 0.403 | 0.834 | 0.222 | 0.404 | 0.834 |
| 1.231 | 0.330 | 0.834 | −1.546 | 0.416 | 0.834 | 0.313 | 0.403 | 0.834 |
| 1.179 | 0.317 | 0.834 | −1.558 | 0.428 | 0.834 | 0.405 | 0.402 | 0.834 |
| 1.121 | 0.302 | 0.834 | −1.566 | 0.438 | 0.834 | 0.497 | 0.401 | 0.834 |
| 1.056 | 0.286 | 0.834 | −1.570 | 0.447 | 0.834 | 0.586 | 0.400 | 0.834 |
| 0.985 | 0.269 | 0.834 | −1.573 | 0.454 | 0.834 | 0.671 | 0.399 | 0.834 |
| 0.910 | 0.252 | 0.834 | −1.573 | 0.461 | 0.834 | 0.754 | 0.399 | 0.834 |
| 0.833 | 0.234 | 0.834 | −1.572 | 0.466 | 0.834 | 0.833 | 0.400 | 0.834 |
| 0.752 | 0.216 | 0.834 | −1.570 | 0.470 | 0.834 | 0.910 | 0.400 | 0.834 |
| 0.668 | 0.199 | 0.834 | −1.566 | 0.474 | 0.834 | 0.983 | 0.402 | 0.834 |
| 0.581 | 0.181 | 0.834 | −1.560 | 0.478 | 0.834 | 1.054 | 0.404 | 0.834 |
| 0.490 | 0.164 | 0.834 | −1.551 | 0.482 | 0.834 | 1.118 | 0.406 | 0.834 |
| 0.396 | 0.148 | 0.834 | −1.539 | 0.485 | 0.834 | 1.176 | 0.408 | 0.834 |
| 0.302 | 0.134 | 0.834 | −1.523 | 0.487 | 0.834 | 1.228 | 0.411 | 0.834 |
| 0.208 | 0.121 | 0.834 | −1.504 | 0.488 | 0.834 | 1.274 | 0.413 | 0.834 |
| 0.113 | 0.110 | 0.834 | −1.479 | 0.487 | 0.834 | 1.313 | 0.416 | 0.834 |
| 0.018 | 0.101 | 0.834 | −1.451 | 0.486 | 0.834 | 1.347 | 0.418 | 0.834 |
| −0.077 | 0.095 | 0.834 | −1.417 | 0.483 | 0.834 | 1.376 | 0.419 | 0.834 |
| −0.172 | 0.092 | 0.834 | −1.378 | 0.479 | 0.834 | 1.400 | 0.421 | 0.834 |
| −0.268 | 0.091 | 0.834 | −1.332 | 0.474 | 0.834 | 1.420 | 0.422 | 0.834 |
| −0.363 | 0.094 | 0.834 | −1.280 | 0.468 | 0.834 | 1.436 | 0.424 | 0.834 |
| −0.458 | 0.098 | 0.834 | −1.223 | 0.461 | 0.834 | 1.448 | 0.424 | 0.834 |
| −0.553 | 0.106 | 0.834 | −1.159 | 0.454 | 0.834 | 1.457 | 0.424 | 0.834 |
| −0.648 | 0.116 | 0.834 | −1.089 | 0.446 | 0.834 | 1.463 | 0.420 | 0.834 |

TABLE 5S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.739 | 0.129 | 0.834 | −1.016 | 0.439 | 0.834 | 1.467 | 0.414 | 0.834 |
| −0.827 | 0.144 | 0.834 | −0.940 | 0.432 | 0.834 | 1.468 | 0.410 | 0.834 |
| −0.910 | 0.161 | 0.834 | −0.860 | 0.426 | 0.834 | | | |
| −0.990 | 0.180 | 0.834 | −0.778 | 0.420 | 0.834 | | | |
| 1.217 | 0.797 | 1.668 | −1.217 | 0.571 | 1.668 | −0.872 | 0.786 | 1.668 |
| 1.215 | 0.791 | 1.668 | −1.288 | 0.588 | 1.668 | −0.786 | 0.785 | 1.668 |
| 1.211 | 0.785 | 1.668 | −1.355 | 0.605 | 1.668 | −0.697 | 0.784 | 1.668 |
| 1.203 | 0.781 | 1.668 | −1.416 | 0.623 | 1.668 | −0.609 | 0.784 | 1.668 |
| 1.191 | 0.777 | 1.668 | −1.472 | 0.641 | 1.668 | −0.520 | 0.784 | 1.668 |
| 1.176 | 0.773 | 1.668 | −1.521 | 0.658 | 1.668 | −0.431 | 0.785 | 1.668 |
| 1.156 | 0.768 | 1.668 | −1.563 | 0.675 | 1.668 | −0.343 | 0.785 | 1.668 |
| 1.133 | 0.762 | 1.668 | −1.600 | 0.690 | 1.668 | −0.254 | 0.785 | 1.668 |
| 1.106 | 0.754 | 1.668 | −1.630 | 0.704 | 1.668 | −0.165 | 0.785 | 1.668 |
| 1.073 | 0.746 | 1.668 | −1.656 | 0.717 | 1.668 | −0.076 | 0.784 | 1.668 |
| 1.035 | 0.736 | 1.668 | −1.677 | 0.729 | 1.668 | 0.012 | 0.784 | 1.668 |
| 0.991 | 0.724 | 1.668 | −1.693 | 0.741 | 1.668 | 0.101 | 0.783 | 1.668 |
| 0.940 | 0.712 | 1.668 | −1.706 | 0.751 | 1.668 | 0.190 | 0.783 | 1.668 |
| 0.884 | 0.698 | 1.668 | −1.714 | 0.760 | 1.668 | 0.279 | 0.783 | 1.668 |
| 0.822 | 0.683 | 1.668 | −1.720 | 0.767 | 1.668 | 0.364 | 0.783 | 1.668 |
| 0.754 | 0.667 | 1.668 | −1.723 | 0.774 | 1.668 | 0.447 | 0.783 | 1.668 |
| 0.682 | 0.650 | 1.668 | −1.724 | 0.780 | 1.668 | 0.527 | 0.784 | 1.668 |
| 0.608 | 0.633 | 1.668 | −1.723 | 0.785 | 1.668 | 0.604 | 0.785 | 1.668 |
| 0.531 | 0.616 | 1.668 | −1.722 | 0.789 | 1.668 | 0.678 | 0.787 | 1.668 |
| 0.450 | 0.600 | 1.668 | −1.718 | 0.794 | 1.668 | 0.749 | 0.789 | 1.668 |
| 0.366 | 0.583 | 1.668 | −1.712 | 0.798 | 1.668 | 0.817 | 0.792 | 1.668 |
| 0.279 | 0.567 | 1.668 | −1.704 | 0.802 | 1.668 | 0.879 | 0.795 | 1.668 |
| 0.189 | 0.551 | 1.668 | −1.693 | 0.806 | 1.668 | 0.935 | 0.798 | 1.668 |
| 0.099 | 0.537 | 1.668 | −1.678 | 0.810 | 1.668 | 0.985 | 0.801 | 1.668 |
| 0.008 | 0.525 | 1.668 | −1.659 | 0.812 | 1.668 | 1.030 | 0.803 | 1.668 |
| −0.082 | 0.514 | 1.668 | −1.636 | 0.814 | 1.668 | 1.068 | 0.806 | 1.668 |
| −0.173 | 0.505 | 1.668 | −1.608 | 0.815 | 1.668 | 1.100 | 0.808 | 1.668 |
| −0.264 | 0.499 | 1.668 | −1.575 | 0.814 | 1.668 | 1.128 | 0.810 | 1.668 |
| −0.356 | 0.495 | 1.668 | −1.537 | 0.813 | 1.668 | 1.152 | 0.812 | 1.668 |
| −0.447 | 0.494 | 1.668 | −1.493 | 0.812 | 1.668 | 1.171 | 0.814 | 1.668 |
| −0.539 | 0.494 | 1.668 | −1.442 | 0.809 | 1.668 | 1.186 | 0.815 | 1.668 |
| −0.630 | 0.497 | 1.668 | −1.386 | 0.806 | 1.668 | 1.198 | 0.816 | 1.668 |
| −0.721 | 0.502 | 1.668 | −1.324 | 0.803 | 1.668 | 1.207 | 0.815 | 1.668 |
| −0.812 | 0.509 | 1.668 | −1.256 | 0.800 | 1.668 | 1.212 | 0.811 | 1.668 |
| −0.900 | 0.518 | 1.668 | −1.185 | 0.796 | 1.668 | 1.216 | 0.806 | 1.668 |
| −0.984 | 0.529 | 1.668 | −1.111 | 0.793 | 1.668 | 1.217 | 0.801 | 1.668 |
| −1.065 | 0.542 | 1.668 | −1.035 | 0.790 | 1.668 | | | |
| −1.143 | 0.556 | 1.668 | −0.955 | 0.788 | 1.668 | | | |
| 1.076 | 1.014 | 2.224 | −1.319 | 0.807 | 2.224 | −0.984 | 0.987 | 2.224 |
| 1.075 | 1.008 | 2.224 | −1.389 | 0.822 | 2.224 | −0.899 | 0.985 | 2.224 |
| 1.070 | 1.002 | 2.224 | −1.456 | 0.838 | 2.224 | −0.812 | 0.984 | 2.224 |
| 1.062 | 0.998 | 2.224 | −1.517 | 0.854 | 2.224 | −0.724 | 0.983 | 2.224 |
| 1.051 | 0.995 | 2.224 | −1.571 | 0.870 | 2.224 | −0.637 | 0.983 | 2.224 |
| 1.036 | 0.991 | 2.224 | −1.620 | 0.885 | 2.224 | −0.549 | 0.983 | 2.224 |
| 1.017 | 0.986 | 2.224 | −1.662 | 0.900 | 2.224 | −0.462 | 0.984 | 2.224 |
| 0.994 | 0.981 | 2.224 | −1.699 | 0.914 | 2.224 | −0.374 | 0.984 | 2.224 |
| 0.967 | 0.974 | 2.224 | −1.729 | 0.926 | 2.224 | −0.287 | 0.984 | 2.224 |
| 0.935 | 0.966 | 2.224 | −1.755 | 0.938 | 2.224 | −0.199 | 0.985 | 2.224 |
| 0.897 | 0.957 | 2.224 | −1.776 | 0.948 | 2.224 | −0.112 | 0.985 | 2.224 |
| 0.853 | 0.946 | 2.224 | −1.793 | 0.959 | 2.224 | −0.024 | 0.985 | 2.224 |
| 0.804 | 0.934 | 2.224 | −1.805 | 0.968 | 2.224 | 0.064 | 0.986 | 2.224 |
| 0.748 | 0.922 | 2.224 | −1.814 | 0.976 | 2.224 | 0.151 | 0.987 | 2.224 |
| 0.687 | 0.908 | 2.224 | −1.820 | 0.983 | 2.224 | 0.236 | 0.988 | 2.224 |
| 0.620 | 0.893 | 2.224 | −1.824 | 0.990 | 2.224 | 0.317 | 0.990 | 2.224 |
| 0.549 | 0.878 | 2.224 | −1.825 | 0.996 | 2.224 | 0.396 | 0.992 | 2.224 |
| 0.476 | 0.862 | 2.224 | −1.825 | 1.000 | 2.224 | 0.472 | 0.994 | 2.224 |
| 0.400 | 0.847 | 2.224 | −1.823 | 1.004 | 2.224 | 0.545 | 0.997 | 2.224 |
| 0.320 | 0.832 | 2.224 | −1.819 | 1.009 | 2.224 | 0.615 | 1.000 | 2.224 |
| 0.238 | 0.817 | 2.224 | −1.813 | 1.013 | 2.224 | 0.682 | 1.003 | 2.224 |
| 0.152 | 0.802 | 2.224 | −1.805 | 1.016 | 2.224 | 0.743 | 1.007 | 2.224 |
| 0.064 | 0.788 | 2.224 | −1.794 | 1.020 | 2.224 | 0.798 | 1.011 | 2.224 |
| −0.025 | 0.775 | 2.224 | −1.779 | 1.022 | 2.224 | 0.848 | 1.015 | 2.224 |
| −0.114 | 0.764 | 2.224 | −1.760 | 1.024 | 2.224 | 0.892 | 1.018 | 2.224 |
| −0.204 | 0.754 | 2.224 | −1.737 | 1.025 | 2.224 | 0.929 | 1.021 | 2.224 |
| −0.293 | 0.746 | 2.224 | −1.710 | 1.025 | 2.224 | 0.961 | 1.024 | 2.224 |
| −0.382 | 0.741 | 2.224 | −1.678 | 1.024 | 2.224 | 0.989 | 1.027 | 2.224 |
| −0.472 | 0.737 | 2.224 | −1.640 | 1.022 | 2.224 | 1.012 | 1.029 | 2.224 |
| −0.562 | 0.736 | 2.224 | −1.596 | 1.020 | 2.224 | 1.031 | 1.030 | 2.224 |
| −0.651 | 0.737 | 2.224 | −1.546 | 1.016 | 2.224 | 1.046 | 1.032 | 2.224 |
| −0.741 | 0.740 | 2.224 | −1.491 | 1.013 | 2.224 | 1.057 | 1.033 | 2.224 |
| −0.831 | 0.744 | 2.224 | −1.430 | 1.009 | 2.224 | 1.066 | 1.032 | 2.224 |
| −0.920 | 0.751 | 2.224 | −1.363 | 1.004 | 2.224 | 1.072 | 1.028 | 2.224 |
| −1.006 | 0.759 | 2.224 | −1.293 | 1.000 | 2.224 | 1.075 | 1.023 | 2.224 |

TABLE 5S-continued

| X-LOC | Y-LOC | Z-LOC | X-LOC | Y-LOC | Z-LOC | X-LOC | Y-LOC | Z-LOC |
|---|---|---|---|---|---|---|---|---|
| −1.090 | 0.769 | 2.224 | −1.220 | 0.997 | 2.224 | 1.076 | 1.019 | 2.224 |
| −1.170 | 0.780 | 2.224 | −1.144 | 0.993 | 2.224 | | | |
| −1.246 | 0.793 | 2.224 | −1.066 | 0.990 | 2.224 | | | |
| 0.881 | 1.304 | 3.336 | −1.455 | 1.150 | 3.336 | −1.134 | 1.260 | 3.336 |
| 0.880 | 1.299 | 3.336 | −1.523 | 1.163 | 3.336 | −1.051 | 1.256 | 3.336 |
| 0.876 | 1.293 | 3.336 | −1.589 | 1.177 | 3.336 | −0.966 | 1.253 | 3.336 |
| 0.868 | 1.289 | 3.336 | −1.648 | 1.191 | 3.336 | −0.880 | 1.250 | 3.336 |
| 0.857 | 1.286 | 3.336 | −1.702 | 1.204 | 3.336 | −0.794 | 1.249 | 3.336 |
| 0.842 | 1.283 | 3.336 | −1.749 | 1.217 | 3.336 | −0.708 | 1.248 | 3.336 |
| 0.823 | 1.279 | 3.336 | −1.791 | 1.230 | 3.336 | −0.623 | 1.248 | 3.336 |
| 0.801 | 1.274 | 3.336 | −1.827 | 1.241 | 3.336 | −0.537 | 1.249 | 3.336 |
| 0.774 | 1.268 | 3.336 | −1.858 | 1.252 | 3.336 | −0.451 | 1.249 | 3.336 |
| 0.743 | 1.261 | 3.336 | −1.883 | 1.261 | 3.336 | −0.366 | 1.250 | 3.336 |
| 0.706 | 1.254 | 3.336 | −1.905 | 1.270 | 3.336 | −0.280 | 1.252 | 3.336 |
| 0.663 | 1.245 | 3.336 | −1.922 | 1.278 | 3.336 | −0.195 | 1.253 | 3.336 |
| 0.615 | 1.235 | 3.336 | −1.935 | 1.286 | 3.336 | −0.109 | 1.256 | 3.336 |
| 0.560 | 1.225 | 3.336 | −1.944 | 1.293 | 3.336 | −0.023 | 1.258 | 3.336 |
| 0.500 | 1.213 | 3.336 | −1.951 | 1.299 | 3.336 | 0.059 | 1.261 | 3.336 |
| 0.435 | 1.201 | 3.336 | −1.955 | 1.305 | 3.336 | 0.139 | 1.265 | 3.336 |
| 0.366 | 1.189 | 3.336 | −1.957 | 1.310 | 3.336 | 0.216 | 1.268 | 3.336 |
| 0.294 | 1.177 | 3.336 | −1.957 | 1.315 | 3.336 | 0.290 | 1.272 | 3.336 |
| 0.219 | 1.165 | 3.336 | −1.955 | 1.319 | 3.336 | 0.362 | 1.277 | 3.336 |
| 0.142 | 1.153 | 3.336 | −1.951 | 1.322 | 3.336 | 0.430 | 1.281 | 3.336 |
| 0.061 | 1.141 | 3.336 | −1.944 | 1.325 | 3.336 | 0.496 | 1.286 | 3.336 |
| −0.022 | 1.130 | 3.336 | −1.936 | 1.328 | 3.336 | 0.556 | 1.291 | 3.336 |
| −0.109 | 1.119 | 3.336 | −1.925 | 1.329 | 3.336 | 0.610 | 1.296 | 3.336 |
| −0.196 | 1.109 | 3.336 | −1.910 | 1.330 | 3.336 | 0.658 | 1.301 | 3.336 |
| −0.283 | 1.101 | 3.336 | −1.891 | 1.330 | 3.336 | 0.701 | 1.305 | 3.336 |
| −0.369 | 1.094 | 3.336 | −1.869 | 1.329 | 3.336 | 0.738 | 1.309 | 3.336 |
| −0.457 | 1.088 | 3.336 | −1.842 | 1.326 | 3.336 | 0.769 | 1.312 | 3.336 |
| −0.544 | 1.085 | 3.336 | −1.811 | 1.323 | 3.336 | 0.796 | 1.315 | 3.336 |
| −0.631 | 1.083 | 3.336 | −1.774 | 1.318 | 3.336 | 0.818 | 1.318 | 3.336 |
| −0.718 | 1.083 | 3.336 | −1.731 | 1.313 | 3.336 | 0.836 | 1.320 | 3.336 |
| −0.805 | 1.084 | 3.336 | −1.683 | 1.307 | 3.336 | 0.851 | 1.322 | 3.336 |
| −0.893 | 1.088 | 3.336 | −1.629 | 1.301 | 3.336 | 0.863 | 1.323 | 3.336 |
| −0.980 | 1.092 | 3.336 | −1.570 | 1.295 | 3.336 | 0.871 | 1.322 | 3.336 |
| −1.066 | 1.099 | 3.336 | −1.504 | 1.288 | 3.336 | 0.877 | 1.317 | 3.336 |
| −1.150 | 1.107 | 3.336 | −1.436 | 1.281 | 3.336 | 0.880 | 1.313 | 3.336 |
| −1.231 | 1.116 | 3.336 | −1.365 | 1.275 | 3.336 | 0.881 | 1.309 | 3.336 |
| −1.309 | 1.126 | 3.336 | −1.291 | 1.270 | 3.336 | | | |
| −1.383 | 1.138 | 3.336 | −1.214 | 1.264 | 3.336 | | | |
| 0.827 | 1.358 | 4.448 | −1.483 | 1.243 | 4.448 | −1.160 | 1.379 | 4.448 |
| 0.825 | 1.353 | 4.448 | −1.550 | 1.259 | 4.448 | −1.078 | 1.374 | 4.448 |
| 0.821 | 1.347 | 4.448 | −1.614 | 1.276 | 4.448 | −0.994 | 1.370 | 4.448 |
| 0.814 | 1.342 | 4.448 | −1.672 | 1.292 | 4.448 | −0.910 | 1.366 | 4.448 |
| 0.803 | 1.340 | 4.448 | −1.725 | 1.308 | 4.448 | −0.825 | 1.363 | 4.448 |
| 0.788 | 1.336 | 4.448 | −1.771 | 1.323 | 4.448 | −0.741 | 1.361 | 4.448 |
| 0.770 | 1.332 | 4.448 | −1.812 | 1.338 | 4.448 | −0.657 | 1.359 | 4.448 |
| 0.748 | 1.327 | 4.448 | −1.847 | 1.351 | 4.448 | −0.572 | 1.358 | 4.448 |
| 0.721 | 1.322 | 4.448 | −1.877 | 1.363 | 4.448 | −0.488 | 1.356 | 4.448 |
| 0.690 | 1.315 | 4.448 | −1.901 | 1.373 | 4.448 | −0.403 | 1.355 | 4.448 |
| 0.654 | 1.307 | 4.448 | −1.922 | 1.384 | 4.448 | −0.319 | 1.353 | 4.448 |
| 0.611 | 1.298 | 4.448 | −1.938 | 1.393 | 4.448 | −0.234 | 1.352 | 4.448 |
| 0.563 | 1.289 | 4.448 | −1.950 | 1.402 | 4.448 | −0.150 | 1.351 | 4.448 |
| 0.510 | 1.278 | 4.448 | −1.959 | 1.409 | 4.448 | −0.066 | 1.351 | 4.448 |
| 0.450 | 1.267 | 4.448 | −1.965 | 1.416 | 4.448 | 0.016 | 1.351 | 4.448 |
| 0.385 | 1.255 | 4.448 | −1.969 | 1.422 | 4.448 | 0.095 | 1.351 | 4.448 |
| 0.317 | 1.242 | 4.448 | −1.971 | 1.427 | 4.448 | 0.171 | 1.351 | 4.448 |
| 0.246 | 1.230 | 4.448 | −1.970 | 1.432 | 4.448 | 0.244 | 1.352 | 4.448 |
| 0.172 | 1.217 | 4.448 | −1.968 | 1.436 | 4.448 | 0.314 | 1.354 | 4.448 |
| 0.095 | 1.205 | 4.448 | −1.964 | 1.439 | 4.448 | 0.382 | 1.355 | 4.448 |
| 0.016 | 1.193 | 4.448 | −1.958 | 1.443 | 4.448 | 0.447 | 1.358 | 4.448 |
| −0.067 | 1.182 | 4.448 | −1.950 | 1.446 | 4.448 | 0.506 | 1.360 | 4.448 |
| −0.153 | 1.172 | 4.448 | −1.939 | 1.448 | 4.448 | 0.559 | 1.363 | 4.448 |
| −0.239 | 1.163 | 4.448 | −1.925 | 1.449 | 4.448 | 0.607 | 1.365 | 4.448 |
| −0.325 | 1.156 | 4.448 | −1.906 | 1.449 | 4.448 | 0.649 | 1.368 | 4.448 |
| −0.411 | 1.151 | 4.448 | −1.884 | 1.449 | 4.448 | 0.686 | 1.370 | 4.448 |
| −0.498 | 1.147 | 4.448 | −1.858 | 1.446 | 4.448 | 0.716 | 1.372 | 4.448 |
| −0.584 | 1.145 | 4.448 | −1.827 | 1.443 | 4.448 | 0.743 | 1.373 | 4.448 |
| −0.670 | 1.146 | 4.448 | −1.791 | 1.440 | 4.448 | 0.765 | 1.375 | 4.448 |
| −0.756 | 1.149 | 4.448 | −1.749 | 1.435 | 4.448 | 0.783 | 1.376 | 4.448 |
| −0.843 | 1.153 | 4.448 | −1.701 | 1.429 | 4.448 | 0.798 | 1.377 | 4.448 |
| −0.929 | 1.159 | 4.448 | −1.648 | 1.423 | 4.448 | 0.809 | 1.378 | 4.448 |
| −1.015 | 1.167 | 4.448 | −1.589 | 1.417 | 4.448 | 0.817 | 1.376 | 4.448 |
| −1.101 | 1.177 | 4.448 | −1.525 | 1.410 | 4.448 | 0.823 | 1.371 | 4.448 |
| −1.183 | 1.188 | 4.448 | −1.457 | 1.403 | 4.448 | 0.825 | 1.366 | 4.448 |
| −1.263 | 1.200 | 4.448 | −1.387 | 1.397 | 4.448 | 0.827 | 1.362 | 4.448 |

TABLE 5S-continued

| X-LOC | Y-LOC | Z-LOC | X-LOC | Y-LOC | Z-LOC | X-LOC | Y-LOC | Z-LOC |
|---|---|---|---|---|---|---|---|---|
| −1.340 | 1.213 | 4.448 | −1.314 | 1.391 | 4.448 | | | |
| −1.413 | 1.228 | 4.448 | −1.239 | 1.385 | 4.448 | | | |
| 0.918 | 1.164 | 5.560 | −1.380 | 1.125 | 5.560 | −1.054 | 1.250 | 5.560 |
| 0.917 | 1.158 | 5.560 | −1.446 | 1.144 | 5.560 | −0.973 | 1.242 | 5.560 |
| 0.913 | 1.153 | 5.560 | −1.509 | 1.163 | 5.560 | −0.890 | 1.234 | 5.560 |
| 0.906 | 1.148 | 5.560 | −1.566 | 1.182 | 5.560 | −0.806 | 1.226 | 5.560 |
| 0.895 | 1.146 | 5.560 | −1.617 | 1.200 | 5.560 | −0.723 | 1.220 | 5.560 |
| 0.880 | 1.143 | 5.560 | −1.663 | 1.217 | 5.560 | −0.639 | 1.214 | 5.560 |
| 0.862 | 1.139 | 5.560 | −1.703 | 1.233 | 5.560 | −0.555 | 1.208 | 5.560 |
| 0.840 | 1.135 | 5.560 | −1.737 | 1.248 | 5.560 | −0.471 | 1.204 | 5.560 |
| 0.813 | 1.130 | 5.560 | −1.766 | 1.261 | 5.560 | −0.388 | 1.199 | 5.560 |
| 0.782 | 1.124 | 5.560 | −1.790 | 1.273 | 5.560 | −0.304 | 1.195 | 5.560 |
| 0.746 | 1.117 | 5.560 | −1.810 | 1.284 | 5.560 | −0.220 | 1.190 | 5.560 |
| 0.703 | 1.110 | 5.560 | −1.826 | 1.294 | 5.560 | −0.136 | 1.186 | 5.560 |
| 0.655 | 1.101 | 5.560 | −1.838 | 1.303 | 5.560 | −0.052 | 1.183 | 5.560 |
| 0.602 | 1.092 | 5.560 | −1.846 | 1.311 | 5.560 | 0.032 | 1.179 | 5.560 |
| 0.542 | 1.083 | 5.560 | −1.852 | 1.318 | 5.560 | 0.113 | 1.177 | 5.560 |
| 0.477 | 1.072 | 5.560 | −1.856 | 1.324 | 5.560 | 0.191 | 1.174 | 5.560 |
| 0.409 | 1.062 | 5.560 | −1.857 | 1.330 | 5.560 | 0.267 | 1.173 | 5.560 |
| 0.338 | 1.051 | 5.560 | −1.857 | 1.334 | 5.560 | 0.339 | 1.172 | 5.560 |
| 0.264 | 1.041 | 5.560 | −1.855 | 1.338 | 5.560 | 0.409 | 1.172 | 5.560 |
| 0.188 | 1.031 | 5.560 | −1.851 | 1.341 | 5.560 | 0.476 | 1.172 | 5.560 |
| 0.108 | 1.021 | 5.560 | −1.844 | 1.345 | 5.560 | 0.541 | 1.172 | 5.560 |
| 0.025 | 1.013 | 5.560 | −1.836 | 1.347 | 5.560 | 0.599 | 1.173 | 5.560 |
| −0.060 | 1.005 | 5.560 | −1.825 | 1.349 | 5.560 | 0.653 | 1.175 | 5.560 |
| −0.146 | 0.999 | 5.560 | −1.811 | 1.350 | 5.560 | 0.700 | 1.176 | 5.560 |
| −0.232 | 0.994 | 5.560 | −1.793 | 1.349 | 5.560 | 0.742 | 1.178 | 5.560 |
| −0.318 | 0.991 | 5.560 | −1.770 | 1.348 | 5.560 | 0.778 | 1.179 | 5.560 |
| −0.404 | 0.991 | 5.560 | −1.744 | 1.345 | 5.560 | 0.809 | 1.180 | 5.560 |
| −0.490 | 0.992 | 5.560 | −1.714 | 1.341 | 5.560 | 0.836 | 1.182 | 5.560 |
| −0.575 | 0.996 | 5.560 | −1.678 | 1.336 | 5.560 | 0.858 | 1.183 | 5.560 |
| −0.661 | 1.002 | 5.560 | −1.636 | 1.330 | 5.560 | 0.876 | 1.184 | 5.560 |
| −0.747 | 1.010 | 5.560 | −1.589 | 1.323 | 5.560 | 0.890 | 1.185 | 5.560 |
| −0.832 | 1.019 | 5.560 | −1.537 | 1.315 | 5.560 | 0.901 | 1.185 | 5.560 |
| −0.917 | 1.030 | 5.560 | −1.479 | 1.306 | 5.560 | 0.909 | 1.182 | 5.560 |
| −1.002 | 1.043 | 5.560 | −1.415 | 1.297 | 5.560 | 0.914 | 1.177 | 5.560 |
| −1.084 | 1.058 | 5.560 | −1.348 | 1.287 | 5.560 | 0.917 | 1.172 | 5.560 |
| −1.163 | 1.073 | 5.560 | −1.279 | 1.278 | 5.560 | 0.918 | 1.168 | 5.560 |
| −1.238 | 1.090 | 5.560 | −1.207 | 1.269 | 5.560 | | | |
| −1.311 | 1.107 | 5.560 | −1.132 | 1.259 | 5.560 | | | |
| 1.125 | 0.773 | 6.672 | −1.163 | 0.854 | 6.672 | −0.847 | 0.896 | 6.672 |
| 1.124 | 0.768 | 6.672 | −1.229 | 0.875 | 6.672 | −0.767 | 0.882 | 6.672 |
| 1.120 | 0.762 | 6.672 | −1.291 | 0.896 | 6.672 | −0.684 | 0.868 | 6.672 |
| 1.112 | 0.757 | 6.672 | −1.348 | 0.916 | 6.672 | −0.601 | 0.856 | 6.672 |
| 1.101 | 0.755 | 6.672 | −1.398 | 0.934 | 6.672 | −0.518 | 0.845 | 6.672 |
| 1.086 | 0.753 | 6.672 | −1.444 | 0.952 | 6.672 | −0.434 | 0.834 | 6.672 |
| 1.068 | 0.750 | 6.672 | −1.483 | 0.968 | 6.672 | −0.351 | 0.825 | 6.672 |
| 1.046 | 0.747 | 6.672 | −1.518 | 0.982 | 6.672 | −0.267 | 0.817 | 6.672 |
| 1.019 | 0.744 | 6.672 | −1.546 | 0.995 | 6.672 | −0.183 | 0.810 | 6.672 |
| 0.988 | 0.739 | 6.672 | −1.571 | 1.006 | 6.672 | −0.099 | 0.803 | 6.672 |
| 0.951 | 0.735 | 6.672 | −1.591 | 1.016 | 6.672 | −0.015 | 0.797 | 6.672 |
| 0.909 | 0.729 | 6.672 | −1.607 | 1.025 | 6.672 | 0.069 | 0.792 | 6.672 |
| 0.861 | 0.723 | 6.672 | −1.619 | 1.034 | 6.672 | 0.153 | 0.788 | 6.672 |
| 0.807 | 0.717 | 6.672 | −1.628 | 1.041 | 6.672 | 0.237 | 0.784 | 6.672 |
| 0.747 | 0.711 | 6.672 | −1.634 | 1.047 | 6.672 | 0.318 | 0.781 | 6.672 |
| 0.682 | 0.704 | 6.672 | −1.639 | 1.053 | 6.672 | 0.396 | 0.779 | 6.672 |
| 0.614 | 0.697 | 6.672 | −1.641 | 1.058 | 6.672 | 0.472 | 0.778 | 6.672 |
| 0.543 | 0.691 | 6.672 | −1.641 | 1.062 | 6.672 | 0.545 | 0.777 | 6.672 |
| 0.469 | 0.686 | 6.672 | −1.638 | 1.066 | 6.672 | 0.615 | 0.777 | 6.672 |
| 0.392 | 0.680 | 6.672 | −1.633 | 1.068 | 6.672 | 0.682 | 0.778 | 6.672 |
| 0.312 | 0.676 | 6.672 | −1.626 | 1.070 | 6.672 | 0.747 | 0.779 | 6.672 |
| 0.229 | 0.673 | 6.672 | −1.618 | 1.071 | 6.672 | 0.806 | 0.780 | 6.672 |
| 0.144 | 0.671 | 6.672 | −1.607 | 1.071 | 6.672 | 0.859 | 0.782 | 6.672 |
| 0.058 | 0.670 | 6.672 | −1.592 | 1.069 | 6.672 | 0.907 | 0.784 | 6.672 |
| −0.027 | 0.671 | 6.672 | −1.574 | 1.066 | 6.672 | 0.949 | 0.786 | 6.672 |
| −0.113 | 0.673 | 6.672 | −1.553 | 1.062 | 6.672 | 0.985 | 0.788 | 6.672 |
| −0.198 | 0.678 | 6.672 | −1.527 | 1.055 | 6.672 | 1.016 | 0.789 | 6.672 |
| −0.284 | 0.684 | 6.672 | −1.497 | 1.047 | 6.672 | 1.042 | 0.791 | 6.672 |
| −0.369 | 0.692 | 6.672 | −1.462 | 1.038 | 6.672 | 1.065 | 0.792 | 6.672 |
| −0.454 | 0.702 | 6.672 | −1.421 | 1.027 | 6.672 | 1.083 | 0.793 | 6.672 |
| −0.539 | 0.714 | 6.672 | −1.375 | 1.015 | 6.672 | 1.097 | 0.794 | 6.672 |
| −0.623 | 0.727 | 6.672 | −1.324 | 1.002 | 6.672 | 1.109 | 0.794 | 6.672 |
| −0.707 | 0.742 | 6.672 | −1.266 | 0.988 | 6.672 | 1.116 | 0.791 | 6.672 |
| −0.791 | 0.759 | 6.672 | −1.204 | 0.972 | 6.672 | 1.121 | 0.786 | 6.672 |
| −0.872 | 0.777 | 6.672 | −1.138 | 0.957 | 6.672 | 1.124 | 0.782 | 6.672 |
| −0.949 | 0.795 | 6.672 | −1.070 | 0.942 | 6.672 | 1.125 | 0.777 | 6.672 |
| −1.024 | 0.814 | 6.672 | −0.998 | 0.926 | 6.672 | | | |

TABLE 5S-continued

| X-LOC | Y-LOC | Z-LOC | X-LOC | Y-LOC | Z-LOC | X-LOC | Y-LOC | Z-LOC |
|---|---|---|---|---|---|---|---|---|
| −1.095 | 0.834 | 6.672 | −0.924 | 0.911 | 6.672 | | | |
| 1.246 | 0.548 | 7.228 | −1.043 | 0.676 | 7.228 | −0.725 | 0.713 | 7.228 |
| 1.245 | 0.543 | 7.228 | −1.107 | 0.698 | 7.228 | −0.645 | 0.697 | 7.228 |
| 1.241 | 0.537 | 7.228 | −1.169 | 0.721 | 7.228 | −0.563 | 0.681 | 7.228 |
| 1.233 | 0.533 | 7.228 | −1.225 | 0.743 | 7.228 | −0.480 | 0.667 | 7.228 |
| 1.222 | 0.531 | 7.228 | −1.276 | 0.763 | 7.228 | −0.396 | 0.654 | 7.228 |
| 1.207 | 0.529 | 7.228 | −1.321 | 0.782 | 7.228 | −0.313 | 0.642 | 7.228 |
| 1.189 | 0.526 | 7.228 | −1.360 | 0.799 | 7.228 | −0.230 | 0.631 | 7.228 |
| 1.167 | 0.523 | 7.228 | −1.394 | 0.814 | 7.228 | −0.146 | 0.622 | 7.228 |
| 1.140 | 0.519 | 7.228 | −1.422 | 0.827 | 7.228 | −0.062 | 0.613 | 7.228 |
| 1.109 | 0.515 | 7.228 | −1.446 | 0.839 | 7.228 | 0.022 | 0.604 | 7.228 |
| 1.072 | 0.510 | 7.228 | −1.466 | 0.850 | 7.228 | 0.105 | 0.597 | 7.228 |
| 1.029 | 0.505 | 7.228 | −1.482 | 0.860 | 7.228 | 0.189 | 0.590 | 7.228 |
| 0.981 | 0.500 | 7.228 | −1.494 | 0.868 | 7.228 | 0.273 | 0.583 | 7.228 |
| 0.927 | 0.494 | 7.228 | −1.503 | 0.876 | 7.228 | 0.357 | 0.578 | 7.228 |
| 0.867 | 0.488 | 7.228 | −1.509 | 0.882 | 7.228 | 0.438 | 0.573 | 7.228 |
| 0.802 | 0.481 | 7.228 | −1.513 | 0.888 | 7.228 | 0.517 | 0.569 | 7.228 |
| 0.733 | 0.476 | 7.228 | −1.516 | 0.893 | 7.228 | 0.593 | 0.566 | 7.228 |
| 0.662 | 0.470 | 7.228 | −1.515 | 0.897 | 7.228 | 0.666 | 0.564 | 7.228 |
| 0.588 | 0.465 | 7.228 | −1.513 | 0.901 | 7.228 | 0.736 | 0.562 | 7.228 |
| 0.511 | 0.461 | 7.228 | −1.508 | 0.903 | 7.228 | 0.803 | 0.561 | 7.228 |
| 0.431 | 0.458 | 7.228 | −1.501 | 0.905 | 7.228 | 0.868 | 0.561 | 7.228 |
| 0.348 | 0.457 | 7.228 | −1.492 | 0.905 | 7.228 | 0.927 | 0.561 | 7.228 |
| 0.262 | 0.456 | 7.228 | −1.481 | 0.904 | 7.228 | 0.980 | 0.562 | 7.228 |
| 0.176 | 0.457 | 7.228 | −1.467 | 0.903 | 7.228 | 1.028 | 0.563 | 7.228 |
| 0.091 | 0.460 | 7.228 | −1.449 | 0.899 | 7.228 | 1.070 | 0.564 | 7.228 |
| 0.005 | 0.465 | 7.228 | −1.427 | 0.894 | 7.228 | 1.106 | 0.565 | 7.228 |
| −0.080 | 0.471 | 7.228 | −1.402 | 0.887 | 7.228 | 1.137 | 0.566 | 7.228 |
| −0.165 | 0.480 | 7.228 | −1.372 | 0.879 | 7.228 | 1.163 | 0.567 | 7.228 |
| −0.251 | 0.490 | 7.228 | −1.337 | 0.868 | 7.228 | 1.186 | 0.568 | 7.228 |
| −0.336 | 0.502 | 7.228 | −1.297 | 0.857 | 7.228 | 1.204 | 0.569 | 7.228 |
| −0.420 | 0.516 | 7.228 | −1.251 | 0.844 | 7.228 | 1.218 | 0.570 | 7.228 |
| −0.505 | 0.532 | 7.228 | −1.199 | 0.829 | 7.228 | 1.230 | 0.569 | 7.228 |
| −0.589 | 0.549 | 7.228 | −1.142 | 0.813 | 7.228 | 1.237 | 0.566 | 7.228 |
| −0.672 | 0.569 | 7.228 | −1.080 | 0.797 | 7.228 | 1.243 | 0.562 | 7.228 |
| −0.753 | 0.589 | 7.228 | −1.015 | 0.780 | 7.228 | 1.245 | 0.557 | 7.228 |
| −0.830 | 0.610 | 7.228 | −0.947 | 0.763 | 7.228 | 1.246 | 0.553 | 7.228 |
| −0.904 | 0.631 | 7.228 | −0.876 | 0.746 | 7.228 | | | |
| −0.975 | 0.653 | 7.228 | −0.802 | 0.729 | 7.228 | | | |
| 1.383 | 0.298 | 7.784 | −0.923 | 0.488 | 7.784 | −0.598 | 0.530 | 7.784 |
| 1.381 | 0.292 | 7.784 | −0.988 | 0.514 | 7.784 | −0.518 | 0.512 | 7.784 |
| 1.377 | 0.286 | 7.784 | −1.049 | 0.539 | 7.784 | −0.436 | 0.494 | 7.784 |
| 1.369 | 0.282 | 7.784 | −1.105 | 0.564 | 7.784 | −0.352 | 0.477 | 7.784 |
| 1.358 | 0.281 | 7.784 | −1.155 | 0.586 | 7.784 | −0.269 | 0.461 | 7.784 |
| 1.343 | 0.278 | 7.784 | −1.200 | 0.607 | 7.784 | −0.186 | 0.446 | 7.784 |
| 1.324 | 0.276 | 7.784 | −1.239 | 0.627 | 7.784 | −0.102 | 0.432 | 7.784 |
| 1.301 | 0.273 | 7.784 | −1.272 | 0.644 | 7.784 | −0.018 | 0.420 | 7.784 |
| 1.274 | 0.269 | 7.784 | −1.300 | 0.659 | 7.784 | 0.066 | 0.408 | 7.784 |
| 1.243 | 0.265 | 7.784 | −1.324 | 0.672 | 7.784 | 0.150 | 0.396 | 7.784 |
| 1.206 | 0.260 | 7.784 | −1.343 | 0.684 | 7.784 | 0.234 | 0.385 | 7.784 |
| 1.162 | 0.255 | 7.784 | −1.359 | 0.694 | 7.784 | 0.319 | 0.375 | 7.784 |
| 1.114 | 0.250 | 7.784 | −1.371 | 0.703 | 7.784 | 0.403 | 0.365 | 7.784 |
| 1.059 | 0.244 | 7.784 | −1.379 | 0.711 | 7.784 | 0.487 | 0.356 | 7.784 |
| 0.998 | 0.238 | 7.784 | −1.385 | 0.718 | 7.784 | 0.569 | 0.348 | 7.784 |
| 0.932 | 0.233 | 7.784 | −1.389 | 0.724 | 7.784 | 0.648 | 0.341 | 7.784 |
| 0.863 | 0.227 | 7.784 | −1.391 | 0.730 | 7.784 | 0.724 | 0.335 | 7.784 |
| 0.791 | 0.223 | 7.784 | −1.390 | 0.734 | 7.784 | 0.797 | 0.329 | 7.784 |
| 0.716 | 0.219 | 7.784 | −1.388 | 0.737 | 7.784 | 0.868 | 0.325 | 7.784 |
| 0.638 | 0.217 | 7.784 | −1.383 | 0.740 | 7.784 | 0.936 | 0.322 | 7.784 |
| 0.557 | 0.216 | 7.784 | −1.376 | 0.741 | 7.784 | 1.001 | 0.320 | 7.784 |
| 0.473 | 0.216 | 7.784 | −1.367 | 0.741 | 7.784 | 1.060 | 0.318 | 7.784 |
| 0.386 | 0.217 | 7.784 | −1.356 | 0.741 | 7.784 | 1.114 | 0.317 | 7.784 |
| 0.299 | 0.221 | 7.784 | −1.341 | 0.739 | 7.784 | 1.162 | 0.317 | 7.784 |
| 0.213 | 0.227 | 7.784 | −1.323 | 0.735 | 7.784 | 1.204 | 0.317 | 7.784 |
| 0.126 | 0.234 | 7.784 | −1.302 | 0.729 | 7.784 | 1.241 | 0.317 | 7.784 |
| 0.040 | 0.244 | 7.784 | −1.276 | 0.722 | 7.784 | 1.272 | 0.318 | 7.784 |
| −0.046 | 0.255 | 7.784 | −1.246 | 0.713 | 7.784 | 1.299 | 0.318 | 7.784 |
| −0.131 | 0.269 | 7.784 | −1.211 | 0.702 | 7.784 | 1.321 | 0.318 | 7.784 |
| −0.217 | 0.285 | 7.784 | −1.171 | 0.690 | 7.784 | 1.340 | 0.319 | 7.784 |
| −0.302 | 0.302 | 7.784 | −1.125 | 0.675 | 7.784 | 1.354 | 0.319 | 7.784 |
| −0.386 | 0.321 | 7.784 | −1.073 | 0.660 | 7.784 | 1.366 | 0.319 | 7.784 |
| −0.471 | 0.342 | 7.784 | −1.016 | 0.643 | 7.784 | 1.374 | 0.316 | 7.784 |
| −0.554 | 0.365 | 7.784 | −0.954 | 0.624 | 7.784 | 1.379 | 0.311 | 7.784 |
| −0.634 | 0.388 | 7.784 | −0.889 | 0.606 | 7.784 | 1.382 | 0.306 | 7.784 |
| −0.711 | 0.413 | 7.784 | −0.820 | 0.587 | 7.784 | 1.383 | 0.302 | 7.784 |
| −0.785 | 0.438 | 7.784 | −0.749 | 0.568 | 7.784 | | | |
| −0.856 | 0.463 | 7.784 | −0.675 | 0.549 | 7.784 | | | |

TABLE 5S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.643 | −0.177 | 8.757 | −0.756 | 0.206 | 8.757 | −0.414 | 0.209 | 8.757 |
| 1.641 | −0.183 | 8.757 | −0.821 | 0.242 | 8.757 | −0.333 | 0.181 | 8.757 |
| 1.636 | −0.189 | 8.757 | −0.882 | 0.276 | 8.757 | −0.249 | 0.152 | 8.757 |
| 1.628 | −0.192 | 8.757 | −0.937 | 0.309 | 8.757 | −0.164 | 0.125 | 8.757 |
| 1.616 | −0.194 | 8.757 | −0.986 | 0.340 | 8.757 | −0.079 | 0.099 | 8.757 |
| 1.600 | −0.196 | 8.757 | −1.030 | 0.367 | 8.757 | 0.007 | 0.074 | 8.757 |
| 1.580 | −0.199 | 8.757 | −1.069 | 0.393 | 8.757 | 0.093 | 0.051 | 8.757 |
| 1.556 | −0.202 | 8.757 | −1.102 | 0.415 | 8.757 | 0.180 | 0.029 | 8.757 |
| 1.528 | −0.206 | 8.757 | −1.129 | 0.434 | 8.757 | 0.267 | 0.009 | 8.757 |
| 1.494 | −0.210 | 8.757 | −1.152 | 0.451 | 8.757 | 0.354 | −0.010 | 8.757 |
| 1.455 | −0.215 | 8.757 | −1.171 | 0.466 | 8.757 | 0.441 | −0.029 | 8.757 |
| 1.409 | −0.219 | 8.757 | −1.187 | 0.479 | 8.757 | 0.528 | −0.046 | 8.757 |
| 1.357 | −0.224 | 8.757 | −1.198 | 0.490 | 8.757 | 0.616 | −0.063 | 8.757 |
| 1.299 | −0.228 | 8.757 | −1.206 | 0.499 | 8.757 | 0.704 | −0.079 | 8.757 |
| 1.235 | −0.233 | 8.757 | −1.212 | 0.506 | 8.757 | 0.789 | −0.093 | 8.757 |
| 1.165 | −0.237 | 8.757 | −1.215 | 0.513 | 8.757 | 0.871 | −0.105 | 8.757 |
| 1.092 | −0.239 | 8.757 | −1.217 | 0.519 | 8.757 | 0.951 | −0.116 | 8.757 |
| 1.015 | −0.241 | 8.757 | −1.216 | 0.524 | 8.757 | 1.027 | −0.126 | 8.757 |
| 0.936 | −0.241 | 8.757 | −1.212 | 0.527 | 8.757 | 1.101 | −0.134 | 8.757 |
| 0.853 | −0.240 | 8.757 | −1.207 | 0.528 | 8.757 | 1.173 | −0.141 | 8.757 |
| 0.768 | −0.236 | 8.757 | −1.199 | 0.529 | 8.757 | 1.241 | −0.146 | 8.757 |
| 0.679 | −0.231 | 8.757 | −1.190 | 0.528 | 8.757 | 1.303 | −0.150 | 8.757 |
| 0.588 | −0.223 | 8.757 | −1.179 | 0.525 | 8.757 | 1.360 | −0.153 | 8.757 |
| 0.497 | −0.212 | 8.757 | −1.164 | 0.521 | 8.757 | 1.410 | −0.155 | 8.757 |
| 0.406 | −0.199 | 8.757 | −1.146 | 0.514 | 8.757 | 1.455 | −0.156 | 8.757 |
| 0.316 | −0.183 | 8.757 | −1.124 | 0.506 | 8.757 | 1.494 | −0.156 | 8.757 |
| 0.226 | −0.164 | 8.757 | −1.098 | 0.495 | 8.757 | 1.526 | −0.157 | 8.757 |
| 0.137 | −0.143 | 8.757 | −1.068 | 0.481 | 8.757 | 1.554 | −0.157 | 8.757 |
| 0.049 | −0.119 | 8.757 | −1.033 | 0.466 | 8.757 | 1.578 | −0.157 | 8.757 |
| −0.039 | −0.094 | 8.757 | −0.992 | 0.448 | 8.757 | 1.597 | −0.156 | 8.757 |
| −0.127 | −0.066 | 8.757 | −0.946 | 0.427 | 8.757 | 1.613 | −0.156 | 8.757 |
| −0.214 | −0.036 | 8.757 | −0.894 | 0.404 | 8.757 | 1.625 | −0.156 | 8.757 |
| −0.299 | −0.004 | 8.757 | −0.837 | 0.379 | 8.757 | 1.633 | −0.159 | 8.757 |
| −0.385 | 0.030 | 8.757 | −0.774 | 0.352 | 8.757 | 1.639 | −0.163 | 8.757 |
| −0.466 | 0.065 | 8.757 | −0.708 | 0.324 | 8.757 | 1.642 | −0.168 | 8.757 |
| −0.544 | 0.100 | 8.757 | −0.639 | 0.296 | 8.757 | 1.643 | −0.173 | 8.757 |
| −0.618 | 0.135 | 8.757 | −0.568 | 0.267 | 8.757 | | | |
| −0.689 | 0.171 | 8.757 | −0.493 | 0.238 | 8.757 | | | |

The coordinate values given in TABLE 6S below provide the nominal profile envelope for an exemplary sixth stage stator.

TABLE 6S

| X-LOC | Y-LOC | Z-LOC | X-LOC | Y-LOC | Z-LOC | X-LOC | Y-LOC | Z-LOC |
|---|---|---|---|---|---|---|---|---|
| 1.672 | −0.083 | 0.000 | −1.050 | −0.038 | 0.000 | −0.611 | 0.144 | 0.000 |
| 1.672 | −0.084 | 0.000 | −1.122 | 0.003 | 0.000 | −0.519 | 0.123 | 0.000 |
| 1.672 | −0.087 | 0.000 | −1.189 | 0.045 | 0.000 | −0.423 | 0.103 | 0.000 |
| 1.671 | −0.092 | 0.000 | −1.249 | 0.085 | 0.000 | −0.327 | 0.085 | 0.000 |
| 1.666 | −0.099 | 0.000 | −1.303 | 0.124 | 0.000 | −0.231 | 0.068 | 0.000 |
| 1.653 | −0.106 | 0.000 | −1.350 | 0.160 | 0.000 | −0.135 | 0.053 | 0.000 |
| 1.633 | −0.112 | 0.000 | −1.390 | 0.193 | 0.000 | −0.038 | 0.039 | 0.000 |
| 1.606 | −0.119 | 0.000 | −1.424 | 0.223 | 0.000 | 0.058 | 0.027 | 0.000 |
| 1.573 | −0.129 | 0.000 | −1.451 | 0.250 | 0.000 | 0.155 | 0.014 | 0.000 |
| 1.529 | −0.141 | 0.000 | −1.474 | 0.273 | 0.000 | 0.252 | 0.003 | 0.000 |
| 1.479 | −0.155 | 0.000 | −1.492 | 0.294 | 0.000 | 0.348 | −0.008 | 0.000 |
| 1.425 | −0.170 | 0.000 | −1.506 | 0.312 | 0.000 | 0.445 | −0.019 | 0.000 |
| 1.365 | −0.186 | 0.000 | −1.516 | 0.327 | 0.000 | 0.542 | −0.028 | 0.000 |
| 1.298 | −0.204 | 0.000 | −1.523 | 0.339 | 0.000 | 0.640 | −0.037 | 0.000 |
| 1.224 | −0.223 | 0.000 | −1.527 | 0.349 | 0.000 | 0.733 | −0.044 | 0.000 |
| 1.146 | −0.242 | 0.000 | −1.529 | 0.358 | 0.000 | 0.824 | −0.051 | 0.000 |
| 1.065 | −0.262 | 0.000 | −1.529 | 0.365 | 0.000 | 0.912 | −0.056 | 0.000 |
| 0.981 | −0.281 | 0.000 | −1.527 | 0.370 | 0.000 | 0.997 | −0.061 | 0.000 |
| 0.892 | −0.300 | 0.000 | −1.524 | 0.373 | 0.000 | 1.078 | −0.065 | 0.000 |
| 0.800 | −0.318 | 0.000 | −1.518 | 0.377 | 0.000 | 1.156 | −0.067 | 0.000 |
| 0.705 | −0.335 | 0.000 | −1.510 | 0.379 | 0.000 | 1.231 | −0.069 | 0.000 |
| 0.605 | −0.350 | 0.000 | −1.501 | 0.380 | 0.000 | 1.303 | −0.069 | 0.000 |
| 0.502 | −0.362 | 0.000 | −1.488 | 0.380 | 0.000 | 1.368 | −0.070 | 0.000 |
| 0.398 | −0.372 | 0.000 | −1.471 | 0.379 | 0.000 | 1.427 | −0.069 | 0.000 |
| 0.295 | −0.378 | 0.000 | −1.450 | 0.376 | 0.000 | 1.479 | −0.069 | 0.000 |
| 0.191 | −0.379 | 0.000 | −1.424 | 0.371 | 0.000 | 1.528 | −0.068 | 0.000 |

TABLE 6S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.087 | −0.376 | 0.000 | −1.394 | 0.365 | 0.000 | 1.570 | −0.067 | 0.000 |
| −0.017 | −0.368 | 0.000 | −1.359 | 0.356 | 0.000 | 1.603 | −0.066 | 0.000 |
| −0.121 | −0.355 | 0.000 | −1.318 | 0.345 | 0.000 | 1.629 | −0.066 | 0.000 |
| −0.223 | −0.337 | 0.000 | −1.271 | 0.331 | 0.000 | 1.648 | −0.065 | 0.000 |
| −0.325 | −0.316 | 0.000 | −1.218 | 0.315 | 0.000 | 1.662 | −0.068 | 0.000 |
| −0.426 | −0.291 | 0.000 | −1.159 | 0.297 | 0.000 | 1.668 | −0.073 | 0.000 |
| −0.526 | −0.262 | 0.000 | −1.093 | 0.277 | 0.000 | 1.671 | −0.078 | 0.000 |
| −0.625 | −0.229 | 0.000 | −1.021 | 0.255 | 0.000 | 1.672 | −0.080 | 0.000 |
| −0.720 | −0.194 | 0.000 | −0.946 | 0.233 | 0.000 | 1.672 | −0.081 | 0.000 |
| −0.809 | −0.157 | 0.000 | −0.868 | 0.210 | 0.000 | 1.672 | −0.082 | 0.000 |
| −0.894 | −0.118 | 0.000 | −0.786 | 0.188 | 0.000 | | | |
| −0.974 | −0.079 | 0.000 | −0.700 | 0.166 | 0.000 | | | |
| 1.524 | 0.218 | 0.773 | −1.012 | 0.053 | 0.773 | −0.629 | 0.283 | 0.773 |
| 1.525 | 0.217 | 0.773 | −1.083 | 0.080 | 0.773 | −0.541 | 0.275 | 0.773 |
| 1.525 | 0.214 | 0.773 | −1.151 | 0.108 | 0.773 | −0.450 | 0.267 | 0.773 |
| 1.524 | 0.209 | 0.773 | −1.212 | 0.136 | 0.773 | −0.359 | 0.261 | 0.773 |
| 1.520 | 0.202 | 0.773 | −1.267 | 0.163 | 0.773 | −0.267 | 0.255 | 0.773 |
| 1.507 | 0.195 | 0.773 | −1.315 | 0.188 | 0.773 | −0.176 | 0.250 | 0.773 |
| 1.489 | 0.190 | 0.773 | −1.357 | 0.212 | 0.773 | −0.084 | 0.246 | 0.773 |
| 1.464 | 0.183 | 0.773 | −1.392 | 0.235 | 0.773 | 0.007 | 0.242 | 0.773 |
| 1.433 | 0.173 | 0.773 | −1.421 | 0.254 | 0.773 | 0.099 | 0.238 | 0.773 |
| 1.393 | 0.162 | 0.773 | −1.446 | 0.273 | 0.773 | 0.190 | 0.234 | 0.773 |
| 1.347 | 0.148 | 0.773 | −1.465 | 0.289 | 0.773 | 0.282 | 0.229 | 0.773 |
| 1.298 | 0.134 | 0.773 | −1.481 | 0.303 | 0.773 | 0.373 | 0.225 | 0.773 |
| 1.242 | 0.118 | 0.773 | −1.492 | 0.316 | 0.773 | 0.465 | 0.222 | 0.773 |
| 1.181 | 0.100 | 0.773 | −1.500 | 0.326 | 0.773 | 0.556 | 0.219 | 0.773 |
| 1.113 | 0.081 | 0.773 | −1.505 | 0.334 | 0.773 | 0.645 | 0.217 | 0.773 |
| 1.042 | 0.062 | 0.773 | −1.508 | 0.342 | 0.773 | 0.730 | 0.216 | 0.773 |
| 0.967 | 0.042 | 0.773 | −1.508 | 0.349 | 0.773 | 0.813 | 0.215 | 0.773 |
| 0.890 | 0.021 | 0.773 | −1.507 | 0.353 | 0.773 | 0.892 | 0.215 | 0.773 |
| 0.809 | 0.001 | 0.773 | −1.505 | 0.357 | 0.773 | 0.968 | 0.215 | 0.773 |
| 0.725 | −0.019 | 0.773 | −1.500 | 0.362 | 0.773 | 1.042 | 0.216 | 0.773 |
| 0.637 | −0.039 | 0.773 | −1.494 | 0.365 | 0.773 | 1.112 | 0.218 | 0.773 |
| 0.546 | −0.057 | 0.773 | −1.485 | 0.368 | 0.773 | 1.179 | 0.220 | 0.773 |
| 0.452 | −0.074 | 0.773 | −1.473 | 0.371 | 0.773 | 1.240 | 0.222 | 0.773 |
| 0.357 | −0.089 | 0.773 | −1.457 | 0.372 | 0.773 | 1.295 | 0.225 | 0.773 |
| 0.261 | −0.101 | 0.773 | −1.438 | 0.373 | 0.773 | 1.344 | 0.227 | 0.773 |
| 0.165 | −0.110 | 0.773 | −1.413 | 0.373 | 0.773 | 1.389 | 0.229 | 0.773 |
| 0.070 | −0.116 | 0.773 | −1.385 | 0.372 | 0.773 | 1.429 | 0.231 | 0.773 |
| −0.026 | −0.118 | 0.773 | −1.351 | 0.370 | 0.773 | 1.460 | 0.233 | 0.773 |
| −0.122 | −0.117 | 0.773 | −1.312 | 0.366 | 0.773 | 1.484 | 0.234 | 0.773 |
| −0.218 | −0.112 | 0.773 | −1.266 | 0.361 | 0.773 | 1.502 | 0.235 | 0.773 |
| −0.314 | −0.104 | 0.773 | −1.215 | 0.355 | 0.773 | 1.515 | 0.233 | 0.773 |
| −0.410 | −0.093 | 0.773 | −1.157 | 0.347 | 0.773 | 1.521 | 0.227 | 0.773 |
| −0.505 | −0.079 | 0.773 | −1.093 | 0.339 | 0.773 | 1.523 | 0.223 | 0.773 |
| −0.599 | −0.062 | 0.773 | −1.024 | 0.329 | 0.773 | 1.524 | 0.221 | 0.773 |
| −0.689 | −0.042 | 0.773 | −0.951 | 0.320 | 0.773 | 1.524 | 0.220 | 0.773 |
| −0.776 | −0.021 | 0.773 | −0.875 | 0.310 | 0.773 | 1.524 | 0.219 | 0.773 |
| −0.858 | 0.002 | 0.773 | −0.796 | 0.301 | 0.773 | | | |
| −0.937 | 0.027 | 0.773 | −0.715 | 0.292 | 0.773 | | | |
| 1.366 | 0.496 | 1.547 | −1.040 | 0.262 | 1.547 | −0.686 | 0.489 | 1.547 |
| 1.366 | 0.494 | 1.547 | −1.109 | 0.284 | 1.547 | −0.602 | 0.486 | 1.547 |
| 1.366 | 0.492 | 1.547 | −1.174 | 0.307 | 1.547 | −0.515 | 0.483 | 1.547 |
| 1.365 | 0.487 | 1.547 | −1.233 | 0.330 | 1.547 | −0.428 | 0.481 | 1.547 |
| 1.361 | 0.480 | 1.547 | −1.287 | 0.353 | 1.547 | −0.341 | 0.480 | 1.547 |
| 1.350 | 0.473 | 1.547 | −1.334 | 0.375 | 1.547 | −0.253 | 0.480 | 1.547 |
| 1.332 | 0.468 | 1.547 | −1.374 | 0.395 | 1.547 | −0.166 | 0.480 | 1.547 |
| 1.309 | 0.461 | 1.547 | −1.409 | 0.414 | 1.547 | −0.079 | 0.480 | 1.547 |
| 1.280 | 0.452 | 1.547 | −1.438 | 0.431 | 1.547 | 0.008 | 0.480 | 1.547 |
| 1.242 | 0.441 | 1.547 | −1.462 | 0.447 | 1.547 | 0.096 | 0.480 | 1.547 |
| 1.198 | 0.428 | 1.547 | −1.481 | 0.461 | 1.547 | 0.183 | 0.479 | 1.547 |
| 1.152 | 0.415 | 1.547 | −1.497 | 0.474 | 1.547 | 0.270 | 0.479 | 1.547 |
| 1.099 | 0.399 | 1.547 | −1.508 | 0.485 | 1.547 | 0.357 | 0.479 | 1.547 |
| 1.041 | 0.382 | 1.547 | −1.516 | 0.494 | 1.547 | 0.444 | 0.479 | 1.547 |
| 0.977 | 0.364 | 1.547 | −1.522 | 0.502 | 1.547 | 0.529 | 0.480 | 1.547 |
| 0.910 | 0.344 | 1.547 | −1.525 | 0.509 | 1.547 | 0.610 | 0.481 | 1.547 |
| 0.840 | 0.324 | 1.547 | −1.525 | 0.515 | 1.547 | 0.689 | 0.482 | 1.547 |
| 0.766 | 0.304 | 1.547 | −1.525 | 0.519 | 1.547 | 0.764 | 0.484 | 1.547 |
| 0.690 | 0.283 | 1.547 | −1.523 | 0.523 | 1.547 | 0.837 | 0.486 | 1.547 |
| 0.611 | 0.262 | 1.547 | −1.519 | 0.528 | 1.547 | 0.907 | 0.488 | 1.547 |
| 0.528 | 0.242 | 1.547 | −1.512 | 0.531 | 1.547 | 0.974 | 0.491 | 1.547 |
| 0.442 | 0.222 | 1.547 | −1.504 | 0.535 | 1.547 | 1.037 | 0.494 | 1.547 |
| 0.353 | 0.204 | 1.547 | −1.493 | 0.537 | 1.547 | 1.096 | 0.498 | 1.547 |
| 0.264 | 0.187 | 1.547 | −1.478 | 0.540 | 1.547 | 1.148 | 0.501 | 1.547 |
| 0.174 | 0.173 | 1.547 | −1.459 | 0.541 | 1.547 | 1.194 | 0.503 | 1.547 |
| 0.083 | 0.161 | 1.547 | −1.436 | 0.542 | 1.547 | 1.238 | 0.506 | 1.547 |
| −0.007 | 0.152 | 1.547 | −1.409 | 0.542 | 1.547 | 1.276 | 0.508 | 1.547 |

TABLE 6S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.098 | 0.146 | 1.547 | −1.377 | 0.541 | 1.547 | 1.305 | 0.510 | 1.547 |
| −0.189 | 0.144 | 1.547 | −1.339 | 0.539 | 1.547 | 1.328 | 0.512 | 1.547 |
| −0.280 | 0.145 | 1.547 | −1.296 | 0.536 | 1.547 | 1.345 | 0.513 | 1.547 |
| −0.371 | 0.148 | 1.547 | −1.246 | 0.532 | 1.547 | 1.358 | 0.509 | 1.547 |
| −0.462 | 0.154 | 1.547 | −1.191 | 0.527 | 1.547 | 1.363 | 0.504 | 1.547 |
| −0.553 | 0.163 | 1.547 | −1.130 | 0.521 | 1.547 | 1.365 | 0.500 | 1.547 |
| −0.643 | 0.175 | 1.547 | −1.064 | 0.515 | 1.547 | 1.365 | 0.498 | 1.547 |
| −0.729 | 0.188 | 1.547 | −0.994 | 0.510 | 1.547 | 1.366 | 0.497 | 1.547 |
| −0.812 | 0.204 | 1.547 | −0.922 | 0.504 | 1.547 | 1.366 | 0.496 | 1.547 |
| −0.892 | 0.222 | 1.547 | −0.846 | 0.499 | 1.547 | | | |
| −0.967 | 0.241 | 1.547 | −0.768 | 0.494 | 1.547 | | | |
| 1.241 | 0.744 | 2.578 | −1.103 | 0.521 | 2.578 | −0.760 | 0.736 | 2.578 |
| 1.241 | 0.743 | 2.578 | −1.171 | 0.542 | 2.578 | −0.678 | 0.733 | 2.578 |
| 1.241 | 0.740 | 2.578 | −1.234 | 0.564 | 2.578 | −0.593 | 0.732 | 2.578 |
| 1.240 | 0.736 | 2.578 | −1.292 | 0.586 | 2.578 | −0.508 | 0.731 | 2.578 |
| 1.237 | 0.729 | 2.578 | −1.344 | 0.607 | 2.578 | −0.423 | 0.730 | 2.578 |
| 1.226 | 0.722 | 2.578 | −1.390 | 0.628 | 2.578 | −0.338 | 0.731 | 2.578 |
| 1.209 | 0.717 | 2.578 | −1.430 | 0.647 | 2.578 | −0.253 | 0.732 | 2.578 |
| 1.186 | 0.711 | 2.578 | −1.464 | 0.665 | 2.578 | −0.168 | 0.734 | 2.578 |
| 1.157 | 0.703 | 2.578 | −1.492 | 0.682 | 2.578 | −0.083 | 0.735 | 2.578 |
| 1.120 | 0.692 | 2.578 | −1.516 | 0.696 | 2.578 | 0.002 | 0.736 | 2.578 |
| 1.078 | 0.680 | 2.578 | −1.535 | 0.710 | 2.578 | 0.087 | 0.736 | 2.578 |
| 1.032 | 0.668 | 2.578 | −1.550 | 0.722 | 2.578 | 0.172 | 0.736 | 2.578 |
| 0.981 | 0.653 | 2.578 | −1.562 | 0.732 | 2.578 | 0.257 | 0.737 | 2.578 |
| 0.924 | 0.638 | 2.578 | −1.570 | 0.741 | 2.578 | 0.342 | 0.737 | 2.578 |
| 0.861 | 0.620 | 2.578 | −1.575 | 0.749 | 2.578 | 0.425 | 0.738 | 2.578 |
| 0.796 | 0.602 | 2.578 | −1.578 | 0.755 | 2.578 | 0.504 | 0.738 | 2.578 |
| 0.727 | 0.584 | 2.578 | −1.579 | 0.761 | 2.578 | 0.581 | 0.739 | 2.578 |
| 0.656 | 0.564 | 2.578 | −1.578 | 0.766 | 2.578 | 0.654 | 0.740 | 2.578 |
| 0.582 | 0.545 | 2.578 | −1.576 | 0.770 | 2.578 | 0.725 | 0.741 | 2.578 |
| 0.504 | 0.525 | 2.578 | −1.572 | 0.774 | 2.578 | 0.793 | 0.743 | 2.578 |
| 0.424 | 0.506 | 2.578 | −1.566 | 0.777 | 2.578 | 0.858 | 0.745 | 2.578 |
| 0.340 | 0.487 | 2.578 | −1.558 | 0.780 | 2.578 | 0.921 | 0.747 | 2.578 |
| 0.253 | 0.469 | 2.578 | −1.547 | 0.783 | 2.578 | 0.977 | 0.750 | 2.578 |
| 0.166 | 0.453 | 2.578 | −1.532 | 0.785 | 2.578 | 1.028 | 0.752 | 2.578 |
| 0.079 | 0.439 | 2.578 | −1.514 | 0.786 | 2.578 | 1.074 | 0.754 | 2.578 |
| −0.009 | 0.428 | 2.578 | −1.492 | 0.786 | 2.578 | 1.116 | 0.756 | 2.578 |
| −0.097 | 0.419 | 2.578 | −1.465 | 0.785 | 2.578 | 1.153 | 0.758 | 2.578 |
| −0.186 | 0.413 | 2.578 | −1.434 | 0.784 | 2.578 | 1.181 | 0.759 | 2.578 |
| −0.274 | 0.411 | 2.578 | −1.397 | 0.781 | 2.578 | 1.204 | 0.760 | 2.578 |
| −0.363 | 0.412 | 2.578 | −1.354 | 0.778 | 2.578 | 1.221 | 0.761 | 2.578 |
| −0.451 | 0.415 | 2.578 | −1.306 | 0.774 | 2.578 | 1.233 | 0.758 | 2.578 |
| −0.540 | 0.420 | 2.578 | −1.253 | 0.769 | 2.578 | 1.238 | 0.753 | 2.578 |
| −0.628 | 0.428 | 2.578 | −1.193 | 0.764 | 2.578 | 1.240 | 0.748 | 2.578 |
| −0.716 | 0.439 | 2.578 | −1.128 | 0.758 | 2.578 | 1.240 | 0.746 | 2.578 |
| −0.800 | 0.452 | 2.578 | −1.061 | 0.753 | 2.578 | 1.241 | 0.745 | 2.578 |
| −0.881 | 0.467 | 2.578 | −0.990 | 0.748 | 2.578 | 1.241 | 0.745 | 2.578 |
| −0.959 | 0.483 | 2.578 | −0.916 | 0.743 | 2.578 | | | |
| −1.033 | 0.501 | 2.578 | −0.840 | 0.739 | 2.578 | | | |
| 1.227 | 0.787 | 3.094 | −1.110 | 0.581 | 3.094 | −0.767 | 0.787 | 3.094 |
| 1.227 | 0.786 | 3.094 | −1.177 | 0.602 | 3.094 | −0.686 | 0.784 | 3.094 |
| 1.227 | 0.783 | 3.094 | −1.240 | 0.624 | 3.094 | −0.601 | 0.782 | 3.094 |
| 1.226 | 0.778 | 3.094 | −1.298 | 0.646 | 3.094 | −0.516 | 0.781 | 3.094 |
| 1.222 | 0.772 | 3.094 | −1.349 | 0.667 | 3.094 | −0.431 | 0.780 | 3.094 |
| 1.211 | 0.765 | 3.094 | −1.395 | 0.688 | 3.094 | −0.347 | 0.781 | 3.094 |
| 1.194 | 0.760 | 3.094 | −1.434 | 0.707 | 3.094 | −0.262 | 0.782 | 3.094 |
| 1.172 | 0.754 | 3.094 | −1.468 | 0.725 | 3.094 | −0.177 | 0.784 | 3.094 |
| 1.143 | 0.747 | 3.094 | −1.496 | 0.741 | 3.094 | −0.092 | 0.785 | 3.094 |
| 1.106 | 0.737 | 3.094 | −1.520 | 0.756 | 3.094 | −0.008 | 0.786 | 3.094 |
| 1.064 | 0.725 | 3.094 | −1.539 | 0.769 | 3.094 | 0.077 | 0.786 | 3.094 |
| 1.018 | 0.713 | 3.094 | −1.554 | 0.781 | 3.094 | 0.162 | 0.786 | 3.094 |
| 0.967 | 0.699 | 3.094 | −1.566 | 0.791 | 3.094 | 0.247 | 0.786 | 3.094 |
| 0.910 | 0.684 | 3.094 | −1.574 | 0.800 | 3.094 | 0.331 | 0.786 | 3.094 |
| 0.848 | 0.668 | 3.094 | −1.579 | 0.807 | 3.094 | 0.413 | 0.786 | 3.094 |
| 0.782 | 0.650 | 3.094 | −1.582 | 0.814 | 3.094 | 0.492 | 0.787 | 3.094 |
| 0.714 | 0.632 | 3.094 | −1.583 | 0.820 | 3.094 | 0.569 | 0.787 | 3.094 |
| 0.643 | 0.614 | 3.094 | −1.582 | 0.825 | 3.094 | 0.642 | 0.788 | 3.094 |
| 0.569 | 0.595 | 3.094 | −1.580 | 0.828 | 3.094 | 0.713 | 0.788 | 3.094 |
| 0.491 | 0.576 | 3.094 | −1.576 | 0.832 | 3.094 | 0.781 | 0.789 | 3.094 |
| 0.411 | 0.558 | 3.094 | −1.570 | 0.836 | 3.094 | 0.846 | 0.791 | 3.094 |
| 0.328 | 0.540 | 3.094 | −1.562 | 0.839 | 3.094 | 0.908 | 0.793 | 3.094 |
| 0.241 | 0.523 | 3.094 | −1.551 | 0.841 | 3.094 | 0.964 | 0.795 | 3.094 |
| 0.154 | 0.507 | 3.094 | −1.536 | 0.842 | 3.094 | 1.015 | 0.796 | 3.094 |
| 0.067 | 0.494 | 3.094 | −1.518 | 0.843 | 3.094 | 1.060 | 0.798 | 3.094 |
| −0.020 | 0.483 | 3.094 | −1.496 | 0.843 | 3.094 | 1.103 | 0.800 | 3.094 |
| −0.108 | 0.475 | 3.094 | −1.469 | 0.842 | 3.094 | 1.139 | 0.801 | 3.094 |
| −0.196 | 0.470 | 3.094 | −1.438 | 0.840 | 3.094 | 1.168 | 0.802 | 3.094 |

TABLE 6S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.284 | 0.469 | 3.094 | −1.401 | 0.837 | 3.094 | 1.190 | 0.803 | 3.094 |
| −0.373 | 0.470 | 3.094 | −1.359 | 0.833 | 3.094 | 1.207 | 0.804 | 3.094 |
| −0.461 | 0.473 | 3.094 | −1.311 | 0.828 | 3.094 | 1.219 | 0.800 | 3.094 |
| −0.549 | 0.479 | 3.094 | −1.258 | 0.823 | 3.094 | 1.224 | 0.795 | 3.094 |
| −0.637 | 0.487 | 3.094 | −1.199 | 0.817 | 3.094 | 1.226 | 0.791 | 3.094 |
| −0.724 | 0.498 | 3.094 | −1.134 | 0.811 | 3.094 | 1.226 | 0.789 | 3.094 |
| −0.808 | 0.511 | 3.094 | −1.066 | 0.805 | 3.094 | 1.227 | 0.788 | 3.094 |
| −0.889 | 0.526 | 3.094 | −0.996 | 0.800 | 3.094 | 1.227 | 0.787 | 3.094 |
| −0.966 | 0.543 | 3.094 | −0.923 | 0.795 | 3.094 | | | |
| −1.040 | 0.561 | 3.094 | −0.846 | 0.790 | 3.094 | | | |
| 1.233 | 0.781 | 3.609 | −1.093 | 0.600 | 3.609 | −0.752 | 0.789 | 3.609 |
| 1.233 | 0.779 | 3.609 | −1.160 | 0.621 | 3.609 | −0.671 | 0.786 | 3.609 |
| 1.233 | 0.777 | 3.609 | −1.223 | 0.643 | 3.609 | −0.587 | 0.783 | 3.609 |
| 1.232 | 0.772 | 3.609 | −1.280 | 0.665 | 3.609 | −0.502 | 0.781 | 3.609 |
| 1.229 | 0.766 | 3.609 | −1.331 | 0.687 | 3.609 | −0.418 | 0.781 | 3.609 |
| 1.218 | 0.759 | 3.609 | −1.376 | 0.707 | 3.609 | −0.334 | 0.781 | 3.609 |
| 1.201 | 0.755 | 3.609 | −1.416 | 0.727 | 3.609 | −0.249 | 0.782 | 3.609 |
| 1.178 | 0.749 | 3.609 | −1.449 | 0.744 | 3.609 | −0.165 | 0.783 | 3.609 |
| 1.150 | 0.742 | 3.609 | −1.477 | 0.760 | 3.609 | −0.080 | 0.784 | 3.609 |
| 1.113 | 0.732 | 3.609 | −1.501 | 0.775 | 3.609 | 0.004 | 0.785 | 3.609 |
| 1.070 | 0.722 | 3.609 | −1.520 | 0.788 | 3.609 | 0.089 | 0.785 | 3.609 |
| 1.025 | 0.710 | 3.609 | −1.535 | 0.800 | 3.609 | 0.173 | 0.785 | 3.609 |
| 0.974 | 0.698 | 3.609 | −1.547 | 0.810 | 3.609 | 0.257 | 0.785 | 3.609 |
| 0.917 | 0.683 | 3.609 | −1.555 | 0.818 | 3.609 | 0.342 | 0.784 | 3.609 |
| 0.855 | 0.668 | 3.609 | −1.560 | 0.825 | 3.609 | 0.423 | 0.784 | 3.609 |
| 0.790 | 0.651 | 3.609 | −1.563 | 0.832 | 3.609 | 0.502 | 0.784 | 3.609 |
| 0.722 | 0.635 | 3.609 | −1.564 | 0.838 | 3.609 | 0.578 | 0.784 | 3.609 |
| 0.651 | 0.617 | 3.609 | −1.563 | 0.842 | 3.609 | 0.651 | 0.785 | 3.609 |
| 0.577 | 0.600 | 3.609 | −1.561 | 0.846 | 3.609 | 0.722 | 0.785 | 3.609 |
| 0.500 | 0.582 | 3.609 | −1.557 | 0.850 | 3.609 | 0.789 | 0.786 | 3.609 |
| 0.420 | 0.565 | 3.609 | −1.551 | 0.853 | 3.609 | 0.854 | 0.787 | 3.609 |
| 0.337 | 0.548 | 3.609 | −1.543 | 0.856 | 3.609 | 0.916 | 0.789 | 3.609 |
| 0.251 | 0.532 | 3.609 | −1.532 | 0.857 | 3.609 | 0.972 | 0.790 | 3.609 |
| 0.164 | 0.517 | 3.609 | −1.517 | 0.858 | 3.609 | 1.023 | 0.792 | 3.609 |
| 0.077 | 0.505 | 3.609 | −1.499 | 0.858 | 3.609 | 1.068 | 0.793 | 3.609 |
| −0.010 | 0.496 | 3.609 | −1.477 | 0.858 | 3.609 | 1.110 | 0.795 | 3.609 |
| −0.097 | 0.489 | 3.609 | −1.450 | 0.856 | 3.609 | 1.146 | 0.796 | 3.609 |
| −0.185 | 0.485 | 3.609 | −1.419 | 0.853 | 3.609 | 1.175 | 0.797 | 3.609 |
| −0.272 | 0.484 | 3.609 | −1.383 | 0.849 | 3.609 | 1.197 | 0.798 | 3.609 |
| −0.360 | 0.486 | 3.609 | −1.341 | 0.844 | 3.609 | 1.214 | 0.798 | 3.609 |
| −0.448 | 0.490 | 3.609 | −1.293 | 0.839 | 3.609 | 1.226 | 0.794 | 3.609 |
| −0.535 | 0.496 | 3.609 | −1.240 | 0.832 | 3.609 | 1.230 | 0.789 | 3.609 |
| −0.623 | 0.505 | 3.609 | −1.182 | 0.826 | 3.609 | 1.232 | 0.785 | 3.609 |
| −0.709 | 0.516 | 3.609 | −1.117 | 0.818 | 3.609 | 1.233 | 0.783 | 3.609 |
| −0.793 | 0.529 | 3.609 | −1.050 | 0.812 | 3.609 | 1.233 | 0.782 | 3.609 |
| −0.873 | 0.545 | 3.609 | −0.980 | 0.805 | 3.609 | 1.233 | 0.781 | 3.609 |
| −0.950 | 0.562 | 3.609 | −0.907 | 0.799 | 3.609 | | | |
| −1.023 | 0.580 | 3.609 | −0.831 | 0.794 | 3.609 | | | |
| 1.261 | 0.721 | 4.125 | −1.050 | 0.576 | 4.125 | −0.713 | 0.741 | 4.125 |
| 1.261 | 0.720 | 4.125 | −1.116 | 0.597 | 4.125 | −0.632 | 0.736 | 4.125 |
| 1.261 | 0.718 | 4.125 | −1.179 | 0.619 | 4.125 | −0.548 | 0.732 | 4.125 |
| 1.260 | 0.713 | 4.125 | −1.235 | 0.641 | 4.125 | −0.464 | 0.729 | 4.125 |
| 1.257 | 0.707 | 4.125 | −1.286 | 0.663 | 4.125 | −0.380 | 0.727 | 4.125 |
| 1.246 | 0.700 | 4.125 | −1.331 | 0.683 | 4.125 | −0.297 | 0.726 | 4.125 |
| 1.229 | 0.696 | 4.125 | −1.370 | 0.702 | 4.125 | −0.213 | 0.726 | 4.125 |
| 1.206 | 0.691 | 4.125 | −1.403 | 0.720 | 4.125 | −0.129 | 0.727 | 4.125 |
| 1.178 | 0.684 | 4.125 | −1.431 | 0.735 | 4.125 | −0.045 | 0.728 | 4.125 |
| 1.142 | 0.676 | 4.125 | −1.455 | 0.750 | 4.125 | 0.039 | 0.728 | 4.125 |
| 1.099 | 0.666 | 4.125 | −1.474 | 0.762 | 4.125 | 0.123 | 0.728 | 4.125 |
| 1.054 | 0.655 | 4.125 | −1.489 | 0.774 | 4.125 | 0.207 | 0.728 | 4.125 |
| 1.003 | 0.644 | 4.125 | −1.501 | 0.784 | 4.125 | 0.291 | 0.728 | 4.125 |
| 0.947 | 0.631 | 4.125 | −1.509 | 0.792 | 4.125 | 0.375 | 0.728 | 4.125 |
| 0.884 | 0.617 | 4.125 | −1.514 | 0.799 | 4.125 | 0.456 | 0.727 | 4.125 |
| 0.819 | 0.602 | 4.125 | −1.517 | 0.806 | 4.125 | 0.534 | 0.727 | 4.125 |
| 0.752 | 0.586 | 4.125 | −1.518 | 0.811 | 4.125 | 0.610 | 0.727 | 4.125 |
| 0.681 | 0.570 | 4.125 | −1.518 | 0.816 | 4.125 | 0.683 | 0.727 | 4.125 |
| 0.607 | 0.554 | 4.125 | −1.515 | 0.819 | 4.125 | 0.753 | 0.728 | 4.125 |
| 0.531 | 0.538 | 4.125 | −1.511 | 0.823 | 4.125 | 0.820 | 0.728 | 4.125 |
| 0.451 | 0.522 | 4.125 | −1.505 | 0.826 | 4.125 | 0.884 | 0.729 | 4.125 |
| 0.368 | 0.506 | 4.125 | −1.497 | 0.828 | 4.125 | 0.946 | 0.730 | 4.125 |
| 0.283 | 0.492 | 4.125 | −1.486 | 0.829 | 4.125 | 1.002 | 0.732 | 4.125 |
| 0.197 | 0.479 | 4.125 | −1.471 | 0.829 | 4.125 | 1.052 | 0.733 | 4.125 |
| 0.111 | 0.469 | 4.125 | −1.453 | 0.828 | 4.125 | 1.097 | 0.734 | 4.125 |
| 0.024 | 0.460 | 4.125 | −1.431 | 0.827 | 4.125 | 1.139 | 0.736 | 4.125 |
| −0.063 | 0.455 | 4.125 | −1.405 | 0.824 | 4.125 | 1.175 | 0.737 | 4.125 |
| −0.150 | 0.453 | 4.125 | −1.374 | 0.820 | 4.125 | 1.203 | 0.738 | 4.125 |
| −0.237 | 0.453 | 4.125 | −1.338 | 0.815 | 4.125 | 1.225 | 0.738 | 4.125 |

TABLE 6S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.324 | 0.455 | 4.125 | −1.296 | 0.809 | 4.125 | 1.242 | 0.739 | 4.125 |
| −0.411 | 0.460 | 4.125 | −1.249 | 0.802 | 4.125 | 1.254 | 0.735 | 4.125 |
| −0.497 | 0.467 | 4.125 | −1.197 | 0.794 | 4.125 | 1.258 | 0.730 | 4.125 |
| −0.583 | 0.477 | 4.125 | −1.139 | 0.786 | 4.125 | 1.260 | 0.726 | 4.125 |
| −0.669 | 0.489 | 4.125 | −1.075 | 0.777 | 4.125 | 1.261 | 0.723 | 4.125 |
| −0.752 | 0.503 | 4.125 | −1.008 | 0.769 | 4.125 | 1.261 | 0.722 | 4.125 |
| −0.832 | 0.519 | 4.125 | −0.939 | 0.761 | 4.125 | 1.261 | 0.722 | 4.125 |
| −0.908 | 0.537 | 4.125 | −0.866 | 0.754 | 4.125 | | | |
| −0.981 | 0.556 | 4.125 | −0.791 | 0.747 | 4.125 | | | |
| 1.302 | 0.624 | 4.641 | −0.985 | 0.516 | 4.641 | −0.653 | 0.653 | 4.641 |
| 1.302 | 0.622 | 4.641 | −1.050 | 0.538 | 4.641 | −0.573 | 0.646 | 4.641 |
| 1.302 | 0.620 | 4.641 | −1.112 | 0.560 | 4.641 | −0.490 | 0.640 | 4.641 |
| 1.302 | 0.616 | 4.641 | −1.168 | 0.582 | 4.641 | −0.407 | 0.636 | 4.641 |
| 1.298 | 0.609 | 4.641 | −1.218 | 0.603 | 4.641 | −0.324 | 0.633 | 4.641 |
| 1.287 | 0.603 | 4.641 | −1.262 | 0.623 | 4.641 | −0.241 | 0.631 | 4.641 |
| 1.271 | 0.599 | 4.641 | −1.301 | 0.642 | 4.641 | −0.158 | 0.630 | 4.641 |
| 1.248 | 0.594 | 4.641 | −1.334 | 0.659 | 4.641 | −0.075 | 0.629 | 4.641 |
| 1.220 | 0.588 | 4.641 | −1.362 | 0.675 | 4.641 | 0.008 | 0.630 | 4.641 |
| 1.184 | 0.581 | 4.641 | −1.385 | 0.689 | 4.641 | 0.091 | 0.630 | 4.641 |
| 1.142 | 0.572 | 4.641 | −1.404 | 0.701 | 4.641 | 0.175 | 0.630 | 4.641 |
| 1.097 | 0.562 | 4.641 | −1.419 | 0.712 | 4.641 | 0.258 | 0.629 | 4.641 |
| 1.046 | 0.552 | 4.641 | −1.431 | 0.721 | 4.641 | 0.341 | 0.629 | 4.641 |
| 0.990 | 0.540 | 4.641 | −1.439 | 0.729 | 4.641 | 0.424 | 0.629 | 4.641 |
| 0.928 | 0.527 | 4.641 | −1.444 | 0.736 | 4.641 | 0.504 | 0.629 | 4.641 |
| 0.864 | 0.513 | 4.641 | −1.447 | 0.743 | 4.641 | 0.582 | 0.629 | 4.641 |
| 0.797 | 0.499 | 4.641 | −1.449 | 0.748 | 4.641 | 0.657 | 0.629 | 4.641 |
| 0.726 | 0.485 | 4.641 | −1.448 | 0.753 | 4.641 | 0.729 | 0.629 | 4.641 |
| 0.653 | 0.470 | 4.641 | −1.446 | 0.756 | 4.641 | 0.798 | 0.629 | 4.641 |
| 0.577 | 0.456 | 4.641 | −1.441 | 0.759 | 4.641 | 0.865 | 0.630 | 4.641 |
| 0.498 | 0.441 | 4.641 | −1.435 | 0.762 | 4.641 | 0.929 | 0.631 | 4.641 |
| 0.416 | 0.428 | 4.641 | −1.427 | 0.763 | 4.641 | 0.990 | 0.632 | 4.641 |
| 0.331 | 0.415 | 4.641 | −1.416 | 0.764 | 4.641 | 1.045 | 0.634 | 4.641 |
| 0.246 | 0.404 | 4.641 | −1.401 | 0.763 | 4.641 | 1.095 | 0.635 | 4.641 |
| 0.161 | 0.395 | 4.641 | −1.383 | 0.762 | 4.641 | 1.139 | 0.637 | 4.641 |
| 0.075 | 0.389 | 4.641 | −1.362 | 0.759 | 4.641 | 1.181 | 0.638 | 4.641 |
| −0.011 | 0.385 | 4.641 | −1.336 | 0.755 | 4.641 | 1.217 | 0.639 | 4.641 |
| −0.097 | 0.384 | 4.641 | −1.306 | 0.750 | 4.641 | 1.245 | 0.640 | 4.641 |
| −0.183 | 0.385 | 4.641 | −1.270 | 0.743 | 4.641 | 1.267 | 0.641 | 4.641 |
| −0.268 | 0.389 | 4.641 | −1.229 | 0.736 | 4.641 | 1.283 | 0.641 | 4.641 |
| −0.354 | 0.395 | 4.641 | −1.183 | 0.727 | 4.641 | 1.295 | 0.637 | 4.641 |
| −0.440 | 0.403 | 4.641 | −1.131 | 0.718 | 4.641 | 1.300 | 0.632 | 4.641 |
| −0.525 | 0.413 | 4.641 | −1.074 | 0.708 | 4.641 | 1.301 | 0.628 | 4.641 |
| −0.610 | 0.426 | 4.641 | −1.011 | 0.698 | 4.641 | 1.302 | 0.626 | 4.641 |
| −0.691 | 0.441 | 4.641 | −0.945 | 0.688 | 4.641 | 1.302 | 0.625 | 4.641 |
| −0.770 | 0.458 | 4.641 | −0.876 | 0.678 | 4.641 | 1.302 | 0.624 | 4.641 |
| −0.845 | 0.476 | 4.641 | −0.805 | 0.669 | 4.641 | | | |
| −0.917 | 0.496 | 4.641 | −0.730 | 0.661 | 4.641 | | | |
| 1.430 | 0.325 | 5.672 | −0.810 | 0.324 | 5.672 | −0.491 | 0.398 | 5.672 |
| 1.431 | 0.324 | 5.672 | −0.873 | 0.347 | 5.672 | −0.412 | 0.386 | 5.672 |
| 1.430 | 0.321 | 5.672 | −0.933 | 0.370 | 5.672 | −0.332 | 0.376 | 5.672 |
| 1.430 | 0.317 | 5.672 | −0.988 | 0.393 | 5.672 | −0.250 | 0.367 | 5.672 |
| 1.426 | 0.311 | 5.672 | −1.036 | 0.414 | 5.672 | −0.169 | 0.359 | 5.672 |
| 1.415 | 0.305 | 5.672 | −1.079 | 0.435 | 5.672 | −0.088 | 0.353 | 5.672 |
| 1.399 | 0.302 | 5.672 | −1.117 | 0.453 | 5.672 | −0.006 | 0.348 | 5.672 |
| 1.377 | 0.298 | 5.672 | −1.149 | 0.470 | 5.672 | 0.076 | 0.344 | 5.672 |
| 1.349 | 0.294 | 5.672 | −1.176 | 0.485 | 5.672 | 0.158 | 0.341 | 5.672 |
| 1.313 | 0.287 | 5.672 | −1.199 | 0.498 | 5.672 | 0.239 | 0.339 | 5.672 |
| 1.272 | 0.280 | 5.672 | −1.218 | 0.510 | 5.672 | 0.321 | 0.337 | 5.672 |
| 1.227 | 0.273 | 5.672 | −1.233 | 0.520 | 5.672 | 0.403 | 0.335 | 5.672 |
| 1.178 | 0.265 | 5.672 | −1.245 | 0.529 | 5.672 | 0.485 | 0.333 | 5.672 |
| 1.122 | 0.256 | 5.672 | −1.253 | 0.537 | 5.672 | 0.567 | 0.332 | 5.672 |
| 1.062 | 0.246 | 5.672 | −1.258 | 0.544 | 5.672 | 0.646 | 0.331 | 5.672 |
| 0.998 | 0.235 | 5.672 | −1.262 | 0.550 | 5.672 | 0.722 | 0.331 | 5.672 |
| 0.932 | 0.225 | 5.672 | −1.263 | 0.555 | 5.672 | 0.796 | 0.330 | 5.672 |
| 0.862 | 0.214 | 5.672 | −1.262 | 0.560 | 5.672 | 0.867 | 0.330 | 5.672 |
| 0.790 | 0.204 | 5.672 | −1.260 | 0.563 | 5.672 | 0.935 | 0.331 | 5.672 |
| 0.715 | 0.193 | 5.672 | −1.255 | 0.565 | 5.672 | 1.000 | 0.331 | 5.672 |
| 0.637 | 0.184 | 5.672 | −1.248 | 0.567 | 5.672 | 1.063 | 0.332 | 5.672 |
| 0.557 | 0.175 | 5.672 | −1.240 | 0.568 | 5.672 | 1.123 | 0.333 | 5.672 |
| 0.473 | 0.167 | 5.672 | −1.229 | 0.567 | 5.672 | 1.177 | 0.335 | 5.672 |
| 0.389 | 0.161 | 5.672 | −1.215 | 0.565 | 5.672 | 1.226 | 0.336 | 5.672 |
| 0.306 | 0.157 | 5.672 | −1.198 | 0.561 | 5.672 | 1.270 | 0.338 | 5.672 |
| 0.222 | 0.155 | 5.672 | −1.177 | 0.556 | 5.672 | 1.311 | 0.339 | 5.672 |
| 0.138 | 0.156 | 5.672 | −1.152 | 0.550 | 5.672 | 1.346 | 0.340 | 5.672 |
| 0.054 | 0.160 | 5.672 | −1.123 | 0.542 | 5.672 | 1.374 | 0.341 | 5.672 |
| −0.030 | 0.165 | 5.672 | −1.089 | 0.532 | 5.672 | 1.395 | 0.342 | 5.672 |
| −0.114 | 0.172 | 5.672 | −1.050 | 0.521 | 5.672 | 1.412 | 0.342 | 5.672 |

TABLE 6S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.198 | 0.182 | 5.672 | −1.005 | 0.509 | 5.672 | 1.423 | 0.338 | 5.672 |
| −0.281 | 0.193 | 5.672 | −0.955 | 0.496 | 5.672 | 1.428 | 0.333 | 5.672 |
| −0.364 | 0.207 | 5.672 | −0.899 | 0.482 | 5.672 | 1.430 | 0.329 | 5.672 |
| −0.446 | 0.223 | 5.672 | −0.838 | 0.467 | 5.672 | 1.430 | 0.327 | 5.672 |
| −0.526 | 0.241 | 5.672 | −0.774 | 0.452 | 5.672 | 1.430 | 0.326 | 5.672 |
| −0.601 | 0.260 | 5.672 | −0.708 | 0.438 | 5.672 | 1.430 | 0.325 | 5.672 |
| −0.674 | 0.280 | 5.672 | −0.638 | 0.424 | 5.672 | | | |
| −0.744 | 0.302 | 5.672 | −0.566 | 0.411 | 5.672 | | | |
| 1.706 | −0.168 | 6.961 | −0.566 | −0.026 | 6.961 | −0.246 | −0.008 | 6.961 |
| 1.706 | −0.169 | 6.961 | −0.629 | 0.001 | 6.961 | −0.167 | −0.027 | 6.961 |
| 1.706 | −0.171 | 6.961 | −0.688 | 0.028 | 6.961 | −0.085 | −0.044 | 6.961 |
| 1.704 | −0.176 | 6.961 | −0.742 | 0.054 | 6.961 | −0.003 | −0.059 | 6.961 |
| 1.701 | −0.182 | 6.961 | −0.791 | 0.078 | 6.961 | 0.080 | −0.073 | 6.961 |
| 1.689 | −0.187 | 6.961 | −0.834 | 0.100 | 6.961 | 0.162 | −0.086 | 6.961 |
| 1.672 | −0.189 | 6.961 | −0.871 | 0.121 | 6.961 | 0.245 | −0.096 | 6.961 |
| 1.650 | −0.192 | 6.961 | −0.903 | 0.139 | 6.961 | 0.327 | −0.106 | 6.961 |
| 1.621 | −0.196 | 6.961 | −0.930 | 0.155 | 6.961 | 0.410 | −0.113 | 6.961 |
| 1.585 | −0.200 | 6.961 | −0.953 | 0.169 | 6.961 | 0.493 | −0.120 | 6.961 |
| 1.542 | −0.205 | 6.961 | −0.972 | 0.182 | 6.961 | 0.576 | −0.126 | 6.961 |
| 1.497 | −0.211 | 6.961 | −0.987 | 0.192 | 6.961 | 0.659 | −0.132 | 6.961 |
| 1.446 | −0.217 | 6.961 | −0.999 | 0.201 | 6.961 | 0.742 | −0.137 | 6.961 |
| 1.390 | −0.223 | 6.961 | −1.007 | 0.209 | 6.961 | 0.825 | −0.141 | 6.961 |
| 1.327 | −0.230 | 6.961 | −1.012 | 0.216 | 6.961 | 0.906 | −0.145 | 6.961 |
| 1.262 | −0.237 | 6.961 | −1.016 | 0.222 | 6.961 | 0.983 | −0.148 | 6.961 |
| 1.194 | −0.244 | 6.961 | −1.017 | 0.228 | 6.961 | 1.058 | −0.151 | 6.961 |
| 1.123 | −0.251 | 6.961 | −1.016 | 0.232 | 6.961 | 1.130 | −0.153 | 6.961 |
| 1.049 | −0.257 | 6.961 | −1.013 | 0.235 | 6.961 | 1.200 | −0.154 | 6.961 |
| 0.973 | −0.262 | 6.961 | −1.008 | 0.237 | 6.961 | 1.267 | −0.155 | 6.961 |
| 0.893 | −0.266 | 6.961 | −1.001 | 0.238 | 6.961 | 1.331 | −0.155 | 6.961 |
| 0.811 | −0.269 | 6.961 | −0.993 | 0.237 | 6.961 | 1.392 | −0.155 | 6.961 |
| 0.725 | −0.271 | 6.961 | −0.982 | 0.235 | 6.961 | 1.447 | −0.155 | 6.961 |
| 0.640 | −0.270 | 6.961 | −0.968 | 0.231 | 6.961 | 1.497 | −0.154 | 6.961 |
| 0.555 | −0.268 | 6.961 | −0.951 | 0.225 | 6.961 | 1.542 | −0.153 | 6.961 |
| 0.470 | −0.263 | 6.961 | −0.930 | 0.217 | 6.961 | 1.584 | −0.153 | 6.961 |
| 0.384 | −0.257 | 6.961 | −0.906 | 0.207 | 6.961 | 1.620 | −0.152 | 6.961 |
| 0.300 | −0.248 | 6.961 | −0.877 | 0.196 | 6.961 | 1.647 | −0.151 | 6.961 |
| 0.215 | −0.237 | 6.961 | −0.844 | 0.183 | 6.961 | 1.670 | −0.151 | 6.961 |
| 0.131 | −0.223 | 6.961 | −0.804 | 0.168 | 6.961 | 1.686 | −0.150 | 6.961 |
| 0.047 | −0.208 | 6.961 | −0.760 | 0.151 | 6.961 | 1.698 | −0.154 | 6.961 |
| −0.037 | −0.191 | 6.961 | −0.710 | 0.133 | 6.961 | 1.703 | −0.159 | 6.961 |
| −0.120 | −0.171 | 6.961 | −0.655 | 0.113 | 6.961 | 1.705 | −0.163 | 6.961 |
| −0.203 | −0.150 | 6.961 | −0.594 | 0.092 | 6.961 | 1.705 | −0.166 | 6.961 |
| −0.282 | −0.127 | 6.961 | −0.530 | 0.071 | 6.961 | 1.706 | −0.167 | 6.961 |
| −0.358 | −0.103 | 6.961 | −0.464 | 0.051 | 6.961 | 1.706 | −0.167 | 6.961 |
| −0.431 | −0.078 | 6.961 | −0.394 | 0.030 | 6.961 | | | |
| −0.500 | −0.052 | 6.961 | −0.321 | 0.011 | 6.961 | | | |
| 1.969 | −0.695 | 8.250 | −0.400 | −0.223 | 8.250 | −0.068 | −0.264 | 8.250 |
| 1.969 | −0.697 | 8.250 | −0.462 | −0.186 | 8.250 | 0.012 | −0.295 | 8.250 |
| 1.969 | −0.699 | 8.250 | −0.522 | −0.149 | 8.250 | 0.096 | −0.327 | 8.250 |
| 1.967 | −0.704 | 8.250 | −0.575 | −0.115 | 8.250 | 0.179 | −0.357 | 8.250 |
| 1.962 | −0.710 | 8.250 | −0.623 | −0.083 | 8.250 | 0.264 | −0.385 | 8.250 |
| 1.949 | −0.714 | 8.250 | −0.666 | −0.053 | 8.250 | 0.348 | −0.411 | 8.250 |
| 1.931 | −0.715 | 8.250 | −0.703 | −0.027 | 8.250 | 0.433 | −0.436 | 8.250 |
| 1.907 | −0.716 | 8.250 | −0.734 | −0.004 | 8.250 | 0.519 | −0.459 | 8.250 |
| 1.876 | −0.718 | 8.250 | −0.761 | 0.016 | 8.250 | 0.605 | −0.481 | 8.250 |
| 1.837 | −0.720 | 8.250 | −0.784 | 0.034 | 8.250 | 0.691 | −0.501 | 8.250 |
| 1.791 | −0.722 | 8.250 | −0.803 | 0.048 | 8.250 | 0.777 | −0.520 | 8.250 |
| 1.743 | −0.724 | 8.250 | −0.818 | 0.061 | 8.250 | 0.864 | −0.537 | 8.250 |
| 1.688 | −0.726 | 8.250 | −0.829 | 0.072 | 8.250 | 0.951 | −0.554 | 8.250 |
| 1.627 | −0.727 | 8.250 | −0.838 | 0.081 | 8.250 | 1.038 | −0.571 | 8.250 |
| 1.561 | −0.728 | 8.250 | −0.843 | 0.088 | 8.250 | 1.122 | −0.586 | 8.250 |
| 1.491 | −0.729 | 8.250 | −0.846 | 0.095 | 8.250 | 1.204 | −0.599 | 8.250 |
| 1.418 | −0.729 | 8.250 | −0.847 | 0.101 | 8.250 | 1.283 | −0.611 | 8.250 |
| 1.342 | −0.727 | 8.250 | −0.846 | 0.106 | 8.250 | 1.359 | −0.622 | 8.250 |
| 1.263 | −0.724 | 8.250 | −0.842 | 0.108 | 8.250 | 1.432 | −0.632 | 8.250 |
| 1.181 | −0.720 | 8.250 | −0.836 | 0.110 | 8.250 | 1.503 | −0.641 | 8.250 |
| 1.096 | −0.713 | 8.250 | −0.829 | 0.109 | 8.250 | 1.571 | −0.648 | 8.250 |
| 1.009 | −0.705 | 8.250 | −0.820 | 0.107 | 8.250 | 1.636 | −0.655 | 8.250 |
| 0.918 | −0.693 | 8.250 | −0.809 | 0.103 | 8.250 | 1.695 | −0.660 | 8.250 |
| 0.829 | −0.679 | 8.250 | −0.795 | 0.097 | 8.250 | 1.748 | −0.664 | 8.250 |
| 0.739 | −0.662 | 8.250 | −0.778 | 0.088 | 8.250 | 1.795 | −0.667 | 8.250 |
| 0.650 | −0.642 | 8.250 | −0.757 | 0.077 | 8.250 | 1.840 | −0.670 | 8.250 |
| 0.562 | −0.621 | 8.250 | −0.733 | 0.063 | 8.250 | 1.878 | −0.673 | 8.250 |
| 0.474 | −0.597 | 8.250 | −0.704 | 0.047 | 8.250 | 1.908 | −0.674 | 8.250 |
| 0.387 | −0.570 | 8.250 | −0.670 | 0.029 | 8.250 | 1.932 | −0.675 | 8.250 |
| 0.300 | −0.542 | 8.250 | −0.631 | 0.007 | 8.250 | 1.949 | −0.676 | 8.250 |
| 0.215 | −0.512 | 8.250 | −0.586 | −0.017 | 8.250 | 1.962 | −0.681 | 8.250 |

TABLE 6S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.129 | −0.480 | 8.250 | −0.536 | −0.043 | 8.250 | 1.967 | −0.686 | 8.250 |
| 0.045 | −0.446 | 8.250 | −0.481 | −0.072 | 8.250 | 1.968 | −0.691 | 8.250 |
| −0.038 | −0.409 | 8.250 | −0.420 | −0.103 | 8.250 | 1.969 | −0.693 | 8.250 |
| −0.117 | −0.373 | 8.250 | −0.356 | −0.135 | 8.250 | 1.969 | −0.694 | 8.250 |
| −0.193 | −0.335 | 8.250 | −0.289 | −0.167 | 8.250 | 1.969 | −0.695 | 8.250 |
| −0.266 | −0.298 | 8.250 | −0.218 | −0.199 | 8.250 | | | |
| −0.335 | −0.260 | 8.250 | −0.145 | −0.231 | 8.250 | | | |

The coordinate values given in TABLE 7S below provide the nominal profile envelope for an exemplary seventh stage stator.

TABLE 7S

| X-LOC | Y-LOC | Z-LOC | X-LOC | Y-LOC | Z-LOC | X-LOC | Y-LOC | Z-LOC |
|---|---|---|---|---|---|---|---|---|
| 1.630 | 0.272 | 0.000 | −1.082 | −0.140 | 0.000 | −0.661 | 0.022 | 0.000 |
| 1.629 | 0.265 | 0.000 | −1.157 | −0.104 | 0.000 | −0.566 | 0.016 | 0.000 |
| 1.623 | 0.258 | 0.000 | −1.227 | −0.067 | 0.000 | −0.468 | 0.012 | 0.000 |
| 1.614 | 0.254 | 0.000 | −1.290 | −0.030 | 0.000 | −0.371 | 0.013 | 0.000 |
| 1.601 | 0.248 | 0.000 | −1.345 | 0.005 | 0.000 | −0.273 | 0.015 | 0.000 |
| 1.585 | 0.241 | 0.000 | −1.393 | 0.040 | 0.000 | −0.175 | 0.020 | 0.000 |
| 1.564 | 0.231 | 0.000 | −1.435 | 0.071 | 0.000 | −0.077 | 0.026 | 0.000 |
| 1.539 | 0.220 | 0.000 | −1.470 | 0.100 | 0.000 | 0.021 | 0.033 | 0.000 |
| 1.509 | 0.206 | 0.000 | −1.499 | 0.126 | 0.000 | 0.119 | 0.041 | 0.000 |
| 1.474 | 0.191 | 0.000 | −1.523 | 0.148 | 0.000 | 0.217 | 0.050 | 0.000 |
| 1.432 | 0.173 | 0.000 | −1.542 | 0.168 | 0.000 | 0.314 | 0.060 | 0.000 |
| 1.384 | 0.152 | 0.000 | −1.558 | 0.185 | 0.000 | 0.412 | 0.070 | 0.000 |
| 1.329 | 0.129 | 0.000 | −1.569 | 0.199 | 0.000 | 0.509 | 0.082 | 0.000 |
| 1.268 | 0.104 | 0.000 | −1.577 | 0.211 | 0.000 | 0.606 | 0.094 | 0.000 |
| 1.200 | 0.076 | 0.000 | −1.582 | 0.220 | 0.000 | 0.700 | 0.107 | 0.000 |
| 1.126 | 0.047 | 0.000 | −1.585 | 0.229 | 0.000 | 0.791 | 0.120 | 0.000 |
| 1.047 | 0.016 | 0.000 | −1.585 | 0.236 | 0.000 | 0.878 | 0.134 | 0.000 |
| 0.966 | −0.015 | 0.000 | −1.583 | 0.241 | 0.000 | 0.962 | 0.148 | 0.000 |
| 0.881 | −0.046 | 0.000 | −1.580 | 0.244 | 0.000 | 1.042 | 0.162 | 0.000 |
| 0.792 | −0.077 | 0.000 | −1.574 | 0.246 | 0.000 | 1.119 | 0.176 | 0.000 |
| 0.699 | −0.108 | 0.000 | −1.566 | 0.247 | 0.000 | 1.193 | 0.191 | 0.000 |
| 0.602 | −0.138 | 0.000 | −1.556 | 0.247 | 0.000 | 1.261 | 0.205 | 0.000 |
| 0.502 | −0.168 | 0.000 | −1.543 | 0.244 | 0.000 | 1.321 | 0.218 | 0.000 |
| 0.401 | −0.195 | 0.000 | −1.526 | 0.241 | 0.000 | 1.376 | 0.230 | 0.000 |
| 0.300 | −0.220 | 0.000 | −1.506 | 0.235 | 0.000 | 1.424 | 0.241 | 0.000 |
| 0.197 | −0.243 | 0.000 | −1.481 | 0.227 | 0.000 | 1.465 | 0.251 | 0.000 |
| 0.094 | −0.262 | 0.000 | −1.452 | 0.217 | 0.000 | 1.500 | 0.259 | 0.000 |
| −0.009 | −0.278 | 0.000 | −1.417 | 0.205 | 0.000 | 1.530 | 0.266 | 0.000 |
| −0.113 | −0.290 | 0.000 | −1.377 | 0.190 | 0.000 | 1.555 | 0.273 | 0.000 |
| −0.218 | −0.298 | 0.000 | −1.331 | 0.174 | 0.000 | 1.576 | 0.278 | 0.000 |
| −0.322 | −0.301 | 0.000 | −1.278 | 0.156 | 0.000 | 1.592 | 0.282 | 0.000 |
| −0.427 | −0.298 | 0.000 | −1.219 | 0.136 | 0.000 | 1.605 | 0.286 | 0.000 |
| −0.532 | −0.290 | 0.000 | −1.153 | 0.116 | 0.000 | 1.615 | 0.287 | 0.000 |
| −0.635 | −0.276 | 0.000 | −1.080 | 0.096 | 0.000 | 1.622 | 0.285 | 0.000 |
| −0.733 | −0.257 | 0.000 | −1.004 | 0.077 | 0.000 | 1.627 | 0.281 | 0.000 |
| −0.827 | −0.233 | 0.000 | −0.923 | 0.060 | 0.000 | 1.629 | 0.277 | 0.000 |
| −0.917 | −0.205 | 0.000 | −0.839 | 0.045 | 0.000 | | | |
| −1.002 | −0.174 | 0.000 | −0.752 | 0.032 | 0.000 | | | |
| 1.358 | 0.643 | 0.745 | −1.070 | 0.075 | 0.745 | −0.725 | 0.331 | 0.745 |
| 1.357 | 0.636 | 0.745 | −1.143 | 0.091 | 0.745 | −0.638 | 0.336 | 0.745 |
| 1.353 | 0.630 | 0.745 | −1.212 | 0.108 | 0.745 | −0.549 | 0.341 | 0.745 |
| 1.345 | 0.625 | 0.745 | −1.275 | 0.127 | 0.745 | −0.460 | 0.348 | 0.745 |
| 1.334 | 0.619 | 0.745 | −1.331 | 0.145 | 0.745 | −0.371 | 0.356 | 0.745 |
| 1.319 | 0.612 | 0.745 | −1.381 | 0.164 | 0.745 | −0.282 | 0.365 | 0.745 |
| 1.301 | 0.603 | 0.745 | −1.425 | 0.182 | 0.745 | −0.192 | 0.375 | 0.745 |
| 1.279 | 0.592 | 0.745 | −1.462 | 0.199 | 0.745 | −0.104 | 0.385 | 0.745 |
| 1.252 | 0.579 | 0.745 | −1.492 | 0.215 | 0.745 | −0.015 | 0.395 | 0.745 |
| 1.221 | 0.565 | 0.745 | −1.518 | 0.230 | 0.745 | 0.074 | 0.406 | 0.745 |
| 1.184 | 0.547 | 0.745 | −1.539 | 0.243 | 0.745 | 0.163 | 0.418 | 0.745 |
| 1.142 | 0.527 | 0.745 | −1.556 | 0.255 | 0.745 | 0.251 | 0.431 | 0.745 |
| 1.093 | 0.505 | 0.745 | −1.568 | 0.266 | 0.745 | 0.340 | 0.444 | 0.745 |
| 1.039 | 0.481 | 0.745 | −1.577 | 0.275 | 0.745 | 0.428 | 0.458 | 0.745 |
| 0.979 | 0.455 | 0.745 | −1.582 | 0.283 | 0.745 | 0.513 | 0.472 | 0.745 |
| 0.913 | 0.426 | 0.745 | −1.585 | 0.290 | 0.745 | 0.596 | 0.486 | 0.745 |
| 0.843 | 0.397 | 0.745 | −1.586 | 0.297 | 0.745 | 0.675 | 0.500 | 0.745 |
| 0.771 | 0.367 | 0.745 | −1.585 | 0.301 | 0.745 | 0.751 | 0.515 | 0.745 |
| 0.695 | 0.337 | 0.745 | −1.583 | 0.306 | 0.745 | 0.824 | 0.530 | 0.745 |

TABLE 7S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.617 | 0.306 | 0.745 | −1.580 | 0.310 | 0.745 | 0.894 | 0.545 | 0.745 |
| 0.534 | 0.276 | 0.745 | −1.574 | 0.315 | 0.745 | 0.962 | 0.560 | 0.745 |
| 0.449 | 0.245 | 0.745 | −1.566 | 0.318 | 0.745 | 1.023 | 0.574 | 0.745 |
| 0.360 | 0.215 | 0.745 | −1.554 | 0.322 | 0.745 | 1.078 | 0.588 | 0.745 |
| 0.271 | 0.187 | 0.745 | −1.539 | 0.325 | 0.745 | 1.127 | 0.600 | 0.745 |
| 0.181 | 0.160 | 0.745 | −1.520 | 0.328 | 0.745 | 1.170 | 0.611 | 0.745 |
| 0.090 | 0.135 | 0.745 | −1.496 | 0.329 | 0.745 | 1.208 | 0.621 | 0.745 |
| −0.001 | 0.112 | 0.745 | −1.468 | 0.330 | 0.745 | 1.240 | 0.630 | 0.745 |
| −0.093 | 0.091 | 0.745 | −1.435 | 0.331 | 0.745 | 1.267 | 0.637 | 0.745 |
| −0.185 | 0.073 | 0.745 | −1.397 | 0.331 | 0.745 | 1.290 | 0.643 | 0.745 |
| −0.277 | 0.059 | 0.745 | −1.352 | 0.330 | 0.745 | 1.308 | 0.649 | 0.745 |
| −0.370 | 0.047 | 0.745 | −1.301 | 0.329 | 0.745 | 1.323 | 0.653 | 0.745 |
| −0.464 | 0.039 | 0.745 | −1.244 | 0.327 | 0.745 | 1.335 | 0.656 | 0.745 |
| −0.557 | 0.034 | 0.745 | −1.182 | 0.326 | 0.745 | 1.344 | 0.658 | 0.745 |
| −0.651 | 0.033 | 0.745 | −1.113 | 0.325 | 0.745 | 1.351 | 0.655 | 0.745 |
| −0.742 | 0.035 | 0.745 | −1.041 | 0.325 | 0.745 | 1.355 | 0.651 | 0.745 |
| −0.830 | 0.041 | 0.745 | −0.967 | 0.325 | 0.745 | 1.357 | 0.647 | 0.745 |
| −0.913 | 0.050 | 0.745 | −0.889 | 0.326 | 0.745 | | | |
| −0.993 | 0.061 | 0.745 | −0.808 | 0.328 | 0.745 | | | |
| 1.175 | 0.890 | 1.375 | −1.189 | 0.330 | 1.375 | −0.864 | 0.587 | 1.375 |
| 1.174 | 0.884 | 1.375 | −1.260 | 0.342 | 1.375 | −0.780 | 0.592 | 1.375 |
| 1.170 | 0.877 | 1.375 | −1.329 | 0.356 | 1.375 | −0.692 | 0.599 | 1.375 |
| 1.163 | 0.872 | 1.375 | −1.391 | 0.370 | 1.375 | −0.605 | 0.606 | 1.375 |
| 1.152 | 0.866 | 1.375 | −1.446 | 0.385 | 1.375 | −0.518 | 0.613 | 1.375 |
| 1.138 | 0.859 | 1.375 | −1.496 | 0.400 | 1.375 | −0.430 | 0.622 | 1.375 |
| 1.120 | 0.851 | 1.375 | −1.539 | 0.415 | 1.375 | −0.343 | 0.631 | 1.375 |
| 1.098 | 0.840 | 1.375 | −1.576 | 0.429 | 1.375 | −0.256 | 0.640 | 1.375 |
| 1.073 | 0.828 | 1.375 | −1.607 | 0.443 | 1.375 | −0.169 | 0.650 | 1.375 |
| 1.042 | 0.813 | 1.375 | −1.633 | 0.455 | 1.375 | −0.082 | 0.661 | 1.375 |
| 1.007 | 0.796 | 1.375 | −1.655 | 0.466 | 1.375 | 0.005 | 0.672 | 1.375 |
| 0.965 | 0.777 | 1.375 | −1.672 | 0.477 | 1.375 | 0.091 | 0.684 | 1.375 |
| 0.918 | 0.756 | 1.375 | −1.684 | 0.486 | 1.375 | 0.178 | 0.696 | 1.375 |
| 0.865 | 0.732 | 1.375 | −1.693 | 0.495 | 1.375 | 0.265 | 0.709 | 1.375 |
| 0.806 | 0.706 | 1.375 | −1.699 | 0.502 | 1.375 | 0.348 | 0.722 | 1.375 |
| 0.742 | 0.679 | 1.375 | −1.702 | 0.509 | 1.375 | 0.429 | 0.736 | 1.375 |
| 0.675 | 0.651 | 1.375 | −1.703 | 0.515 | 1.375 | 0.506 | 0.750 | 1.375 |
| 0.604 | 0.622 | 1.375 | −1.703 | 0.520 | 1.375 | 0.581 | 0.764 | 1.375 |
| 0.530 | 0.593 | 1.375 | −1.702 | 0.524 | 1.375 | 0.653 | 0.778 | 1.375 |
| 0.453 | 0.564 | 1.375 | −1.698 | 0.529 | 1.375 | 0.721 | 0.793 | 1.375 |
| 0.373 | 0.535 | 1.375 | −1.693 | 0.534 | 1.375 | 0.787 | 0.808 | 1.375 |
| 0.290 | 0.506 | 1.375 | −1.686 | 0.538 | 1.375 | 0.847 | 0.822 | 1.375 |
| 0.203 | 0.477 | 1.375 | −1.675 | 0.543 | 1.375 | 0.901 | 0.835 | 1.375 |
| 0.116 | 0.450 | 1.375 | −1.660 | 0.547 | 1.375 | 0.949 | 0.847 | 1.375 |
| 0.028 | 0.424 | 1.375 | −1.642 | 0.551 | 1.375 | 0.991 | 0.859 | 1.375 |
| −0.060 | 0.400 | 1.375 | −1.619 | 0.555 | 1.375 | 1.028 | 0.869 | 1.375 |
| −0.149 | 0.378 | 1.375 | −1.592 | 0.558 | 1.375 | 1.059 | 0.877 | 1.375 |
| −0.238 | 0.359 | 1.375 | −1.560 | 0.560 | 1.375 | 1.086 | 0.884 | 1.375 |
| −0.328 | 0.342 | 1.375 | −1.522 | 0.563 | 1.375 | 1.108 | 0.891 | 1.375 |
| −0.418 | 0.327 | 1.375 | −1.478 | 0.565 | 1.375 | 1.126 | 0.896 | 1.375 |
| −0.509 | 0.316 | 1.375 | −1.428 | 0.567 | 1.375 | 1.141 | 0.900 | 1.375 |
| −0.599 | 0.307 | 1.375 | −1.373 | 0.568 | 1.375 | 1.152 | 0.904 | 1.375 |
| −0.691 | 0.302 | 1.375 | −1.311 | 0.570 | 1.375 | 1.161 | 0.905 | 1.375 |
| −0.782 | 0.300 | 1.375 | −1.244 | 0.571 | 1.375 | 1.167 | 0.902 | 1.375 |
| −0.870 | 0.301 | 1.375 | −1.174 | 0.573 | 1.375 | 1.172 | 0.898 | 1.375 |
| −0.955 | 0.305 | 1.375 | −1.101 | 0.576 | 1.375 | 1.174 | 0.894 | 1.375 |
| −1.036 | 0.311 | 1.375 | −1.025 | 0.579 | 1.375 | | | |
| −1.114 | 0.319 | 1.375 | −0.946 | 0.582 | 1.375 | | | |
| 1.032 | 1.080 | 2.005 | −1.303 | 0.556 | 2.005 | −0.986 | 0.796 | 2.005 |
| 1.031 | 1.074 | 2.005 | −1.374 | 0.567 | 2.005 | −0.902 | 0.800 | 2.005 |
| 1.028 | 1.067 | 2.005 | −1.441 | 0.580 | 2.005 | −0.815 | 0.806 | 2.005 |
| 1.020 | 1.062 | 2.005 | −1.502 | 0.593 | 2.005 | −0.729 | 0.812 | 2.005 |
| 1.009 | 1.057 | 2.005 | −1.557 | 0.606 | 2.005 | −0.643 | 0.819 | 2.005 |
| 0.995 | 1.050 | 2.005 | −1.607 | 0.620 | 2.005 | −0.556 | 0.826 | 2.005 |
| 0.978 | 1.042 | 2.005 | −1.650 | 0.633 | 2.005 | −0.470 | 0.834 | 2.005 |
| 0.956 | 1.031 | 2.005 | −1.687 | 0.646 | 2.005 | −0.384 | 0.843 | 2.005 |
| 0.931 | 1.019 | 2.005 | −1.717 | 0.658 | 2.005 | −0.298 | 0.852 | 2.005 |
| 0.901 | 1.006 | 2.005 | −1.743 | 0.669 | 2.005 | −0.212 | 0.861 | 2.005 |
| 0.865 | 0.989 | 2.005 | −1.765 | 0.680 | 2.005 | −0.126 | 0.872 | 2.005 |
| 0.824 | 0.971 | 2.005 | −1.782 | 0.689 | 2.005 | −0.040 | 0.882 | 2.005 |
| 0.778 | 0.951 | 2.005 | −1.795 | 0.698 | 2.005 | 0.046 | 0.894 | 2.005 |
| 0.725 | 0.928 | 2.005 | −1.804 | 0.706 | 2.005 | 0.131 | 0.906 | 2.005 |
| 0.667 | 0.904 | 2.005 | −1.810 | 0.713 | 2.005 | 0.214 | 0.918 | 2.005 |
| 0.603 | 0.878 | 2.005 | −1.813 | 0.720 | 2.005 | 0.294 | 0.931 | 2.005 |
| 0.537 | 0.851 | 2.005 | −1.815 | 0.726 | 2.005 | 0.371 | 0.944 | 2.005 |
| 0.467 | 0.824 | 2.005 | −1.815 | 0.730 | 2.005 | 0.444 | 0.958 | 2.005 |
| 0.394 | 0.796 | 2.005 | −1.813 | 0.735 | 2.005 | 0.515 | 0.972 | 2.005 |
| 0.318 | 0.769 | 2.005 | −1.810 | 0.739 | 2.005 | 0.583 | 0.986 | 2.005 |

TABLE 7S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.238 | 0.741 | 2.005 | −1.805 | 0.744 | 2.005 | 0.648 | 1.000 | 2.005 |
| 0.156 | 0.714 | 2.005 | −1.797 | 0.749 | 2.005 | 0.707 | 1.014 | 2.005 |
| 0.070 | 0.688 | 2.005 | −1.787 | 0.753 | 2.005 | 0.761 | 1.027 | 2.005 |
| −0.016 | 0.663 | 2.005 | −1.772 | 0.758 | 2.005 | 0.809 | 1.039 | 2.005 |
| −0.103 | 0.639 | 2.005 | −1.754 | 0.762 | 2.005 | 0.851 | 1.050 | 2.005 |
| −0.191 | 0.617 | 2.005 | −1.731 | 0.765 | 2.005 | 0.887 | 1.060 | 2.005 |
| −0.278 | 0.597 | 2.005 | −1.704 | 0.768 | 2.005 | 0.918 | 1.068 | 2.005 |
| −0.366 | 0.579 | 2.005 | −1.673 | 0.771 | 2.005 | 0.944 | 1.075 | 2.005 |
| −0.455 | 0.564 | 2.005 | −1.635 | 0.773 | 2.005 | 0.966 | 1.082 | 2.005 |
| −0.544 | 0.551 | 2.005 | −1.592 | 0.775 | 2.005 | 0.984 | 1.087 | 2.005 |
| −0.633 | 0.541 | 2.005 | −1.543 | 0.777 | 2.005 | 0.998 | 1.091 | 2.005 |
| −0.723 | 0.534 | 2.005 | −1.488 | 0.778 | 2.005 | 1.009 | 1.094 | 2.005 |
| −0.812 | 0.530 | 2.005 | −1.427 | 0.780 | 2.005 | 1.018 | 1.095 | 2.005 |
| −0.902 | 0.528 | 2.005 | −1.361 | 0.782 | 2.005 | 1.025 | 1.092 | 2.005 |
| −0.989 | 0.529 | 2.005 | −1.292 | 0.784 | 2.005 | 1.029 | 1.088 | 2.005 |
| −1.072 | 0.533 | 2.005 | −1.219 | 0.786 | 2.005 | 1.031 | 1.084 | 2.005 |
| −1.152 | 0.539 | 2.005 | −1.144 | 0.789 | 2.005 | | | |
| −1.229 | 0.546 | 2.005 | −1.066 | 0.792 | 2.005 | | | |
| 0.947 | 1.187 | 2.635 | −1.376 | 0.715 | 2.635 | −1.060 | 0.933 | 2.635 |
| 0.947 | 1.181 | 2.635 | −1.445 | 0.726 | 2.635 | −0.977 | 0.936 | 2.635 |
| 0.944 | 1.175 | 2.635 | −1.512 | 0.739 | 2.635 | −0.891 | 0.940 | 2.635 |
| 0.937 | 1.169 | 2.635 | −1.573 | 0.752 | 2.635 | −0.805 | 0.945 | 2.635 |
| 0.926 | 1.165 | 2.635 | −1.628 | 0.765 | 2.635 | −0.719 | 0.951 | 2.635 |
| 0.912 | 1.158 | 2.635 | −1.676 | 0.778 | 2.635 | −0.633 | 0.957 | 2.635 |
| 0.894 | 1.150 | 2.635 | −1.719 | 0.790 | 2.635 | −0.547 | 0.963 | 2.635 |
| 0.873 | 1.141 | 2.635 | −1.756 | 0.802 | 2.635 | −0.462 | 0.970 | 2.635 |
| 0.847 | 1.129 | 2.635 | −1.787 | 0.814 | 2.635 | −0.376 | 0.978 | 2.635 |
| 0.817 | 1.116 | 2.635 | −1.812 | 0.824 | 2.635 | −0.291 | 0.986 | 2.635 |
| 0.782 | 1.101 | 2.635 | −1.834 | 0.834 | 2.635 | −0.205 | 0.995 | 2.635 |
| 0.741 | 1.084 | 2.635 | −1.851 | 0.843 | 2.635 | −0.120 | 1.004 | 2.635 |
| 0.694 | 1.064 | 2.635 | −1.864 | 0.851 | 2.635 | −0.034 | 1.015 | 2.635 |
| 0.642 | 1.043 | 2.635 | −1.873 | 0.859 | 2.635 | 0.051 | 1.025 | 2.635 |
| 0.584 | 1.021 | 2.635 | −1.879 | 0.866 | 2.635 | 0.133 | 1.037 | 2.635 |
| 0.520 | 0.996 | 2.635 | −1.883 | 0.872 | 2.635 | 0.213 | 1.049 | 2.635 |
| 0.454 | 0.971 | 2.635 | −1.885 | 0.878 | 2.635 | 0.289 | 1.061 | 2.635 |
| 0.384 | 0.946 | 2.635 | −1.884 | 0.883 | 2.635 | 0.363 | 1.073 | 2.635 |
| 0.311 | 0.921 | 2.635 | −1.883 | 0.887 | 2.635 | 0.433 | 1.086 | 2.635 |
| 0.235 | 0.895 | 2.635 | −1.880 | 0.891 | 2.635 | 0.501 | 1.099 | 2.635 |
| 0.156 | 0.870 | 2.635 | −1.874 | 0.896 | 2.635 | 0.566 | 1.113 | 2.635 |
| 0.073 | 0.846 | 2.635 | −1.867 | 0.900 | 2.635 | 0.625 | 1.126 | 2.635 |
| −0.012 | 0.821 | 2.635 | −1.856 | 0.904 | 2.635 | 0.678 | 1.138 | 2.635 |
| −0.098 | 0.799 | 2.635 | −1.842 | 0.908 | 2.635 | 0.725 | 1.150 | 2.635 |
| −0.185 | 0.778 | 2.635 | −1.824 | 0.912 | 2.635 | 0.767 | 1.160 | 2.635 |
| −0.272 | 0.758 | 2.635 | −1.801 | 0.915 | 2.635 | 0.803 | 1.169 | 2.635 |
| −0.359 | 0.740 | 2.635 | −1.774 | 0.917 | 2.635 | 0.834 | 1.177 | 2.635 |
| −0.446 | 0.725 | 2.635 | −1.743 | 0.919 | 2.635 | 0.860 | 1.184 | 2.635 |
| −0.534 | 0.712 | 2.635 | −1.705 | 0.920 | 2.635 | 0.882 | 1.190 | 2.635 |
| −0.623 | 0.701 | 2.635 | −1.662 | 0.922 | 2.635 | 0.900 | 1.195 | 2.635 |
| −0.711 | 0.693 | 2.635 | −1.614 | 0.923 | 2.635 | 0.914 | 1.199 | 2.635 |
| −0.800 | 0.688 | 2.635 | −1.559 | 0.923 | 2.635 | 0.925 | 1.202 | 2.635 |
| −0.889 | 0.685 | 2.635 | −1.499 | 0.924 | 2.635 | 0.934 | 1.203 | 2.635 |
| −0.978 | 0.684 | 2.635 | −1.433 | 0.925 | 2.635 | 0.940 | 1.199 | 2.635 |
| −1.064 | 0.687 | 2.635 | −1.364 | 0.925 | 2.635 | 0.944 | 1.195 | 2.635 |
| −1.147 | 0.691 | 2.635 | −1.292 | 0.927 | 2.635 | 0.946 | 1.192 | 2.635 |
| −1.226 | 0.697 | 2.635 | −1.218 | 0.928 | 2.635 | | | |
| −1.302 | 0.705 | 2.635 | −1.140 | 0.930 | 2.635 | | | |
| 0.926 | 1.205 | 3.265 | −1.390 | 0.782 | 3.265 | −1.074 | 0.983 | 3.265 |
| 0.925 | 1.199 | 3.265 | −1.459 | 0.794 | 3.265 | −0.991 | 0.985 | 3.265 |
| 0.922 | 1.192 | 3.265 | −1.526 | 0.807 | 3.265 | −0.905 | 0.988 | 3.265 |
| 0.915 | 1.187 | 3.265 | −1.586 | 0.820 | 3.265 | −0.820 | 0.991 | 3.265 |
| 0.904 | 1.182 | 3.265 | −1.640 | 0.834 | 3.265 | −0.734 | 0.995 | 3.265 |
| 0.890 | 1.176 | 3.265 | −1.688 | 0.847 | 3.265 | −0.649 | 0.999 | 3.265 |
| 0.873 | 1.168 | 3.265 | −1.731 | 0.860 | 3.265 | −0.564 | 1.004 | 3.265 |
| 0.851 | 1.159 | 3.265 | −1.767 | 0.872 | 3.265 | −0.478 | 1.010 | 3.265 |
| 0.826 | 1.148 | 3.265 | −1.798 | 0.883 | 3.265 | −0.393 | 1.016 | 3.265 |
| 0.796 | 1.136 | 3.265 | −1.823 | 0.893 | 3.265 | −0.308 | 1.023 | 3.265 |
| 0.760 | 1.121 | 3.265 | −1.845 | 0.903 | 3.265 | −0.223 | 1.030 | 3.265 |
| 0.719 | 1.105 | 3.265 | −1.862 | 0.912 | 3.265 | −0.138 | 1.038 | 3.265 |
| 0.673 | 1.086 | 3.265 | −1.875 | 0.920 | 3.265 | −0.053 | 1.047 | 3.265 |
| 0.621 | 1.066 | 3.265 | −1.884 | 0.928 | 3.265 | 0.032 | 1.057 | 3.265 |
| 0.563 | 1.045 | 3.265 | −1.890 | 0.935 | 3.265 | 0.114 | 1.067 | 3.265 |
| 0.499 | 1.021 | 3.265 | −1.894 | 0.941 | 3.265 | 0.193 | 1.077 | 3.265 |
| 0.432 | 0.998 | 3.265 | −1.895 | 0.947 | 3.265 | 0.270 | 1.088 | 3.265 |
| 0.362 | 0.974 | 3.265 | −1.895 | 0.951 | 3.265 | 0.343 | 1.100 | 3.265 |
| 0.290 | 0.950 | 3.265 | −1.894 | 0.955 | 3.265 | 0.413 | 1.112 | 3.265 |
| 0.214 | 0.926 | 3.265 | −1.890 | 0.960 | 3.265 | 0.481 | 1.124 | 3.265 |
| 0.135 | 0.903 | 3.265 | −1.885 | 0.964 | 3.265 | 0.545 | 1.137 | 3.265 |

TABLE 7S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.052 | 0.880 | 3.265 | −1.877 | 0.968 | 3.265 | 0.604 | 1.149 | 3.265 |
| −0.033 | 0.858 | 3.265 | −1.867 | 0.972 | 3.265 | 0.657 | 1.160 | 3.265 |
| −0.119 | 0.837 | 3.265 | −1.852 | 0.976 | 3.265 | 0.705 | 1.171 | 3.265 |
| −0.205 | 0.818 | 3.265 | −1.834 | 0.979 | 3.265 | 0.746 | 1.181 | 3.265 |
| −0.292 | 0.801 | 3.265 | −1.811 | 0.981 | 3.265 | 0.782 | 1.190 | 3.265 |
| −0.379 | 0.786 | 3.265 | −1.785 | 0.982 | 3.265 | 0.813 | 1.197 | 3.265 |
| −0.467 | 0.772 | 3.265 | −1.753 | 0.983 | 3.265 | 0.839 | 1.204 | 3.265 |
| −0.554 | 0.761 | 3.265 | −1.716 | 0.984 | 3.265 | 0.861 | 1.209 | 3.265 |
| −0.642 | 0.753 | 3.265 | −1.673 | 0.984 | 3.265 | 0.879 | 1.214 | 3.265 |
| −0.730 | 0.747 | 3.265 | −1.625 | 0.984 | 3.265 | 0.893 | 1.218 | 3.265 |
| −0.819 | 0.744 | 3.265 | −1.570 | 0.984 | 3.265 | 0.904 | 1.221 | 3.265 |
| −0.907 | 0.743 | 3.265 | −1.510 | 0.983 | 3.265 | 0.913 | 1.221 | 3.265 |
| −0.995 | 0.744 | 3.265 | −1.445 | 0.982 | 3.265 | 0.919 | 1.217 | 3.265 |
| −1.081 | 0.748 | 3.265 | −1.376 | 0.982 | 3.265 | 0.923 | 1.213 | 3.265 |
| −1.163 | 0.754 | 3.265 | −1.305 | 0.982 | 3.265 | 0.925 | 1.209 | 3.265 |
| −1.242 | 0.762 | 3.265 | −1.231 | 0.982 | 3.265 | | | |
| −1.318 | 0.771 | 3.265 | −1.154 | 0.982 | 3.265 | | | |
| 0.964 | 1.138 | 3.896 | −1.348 | 0.762 | 3.896 | −1.030 | 0.949 | 3.896 |
| 0.964 | 1.132 | 3.896 | −1.417 | 0.776 | 3.896 | −0.948 | 0.949 | 3.896 |
| 0.961 | 1.125 | 3.896 | −1.482 | 0.790 | 3.896 | −0.862 | 0.950 | 3.896 |
| 0.954 | 1.120 | 3.896 | −1.542 | 0.804 | 3.896 | −0.777 | 0.952 | 3.896 |
| 0.943 | 1.115 | 3.896 | −1.596 | 0.819 | 3.896 | −0.692 | 0.954 | 3.896 |
| 0.929 | 1.109 | 3.896 | −1.644 | 0.833 | 3.896 | −0.607 | 0.957 | 3.896 |
| 0.912 | 1.102 | 3.896 | −1.686 | 0.846 | 3.896 | −0.522 | 0.960 | 3.896 |
| 0.890 | 1.093 | 3.896 | −1.722 | 0.859 | 3.896 | −0.436 | 0.965 | 3.896 |
| 0.865 | 1.082 | 3.896 | −1.752 | 0.870 | 3.896 | −0.351 | 0.969 | 3.896 |
| 0.835 | 1.070 | 3.896 | −1.778 | 0.881 | 3.896 | −0.266 | 0.974 | 3.896 |
| 0.799 | 1.056 | 3.896 | −1.799 | 0.891 | 3.896 | −0.181 | 0.980 | 3.896 |
| 0.758 | 1.041 | 3.896 | −1.815 | 0.900 | 3.896 | −0.096 | 0.987 | 3.896 |
| 0.711 | 1.023 | 3.896 | −1.828 | 0.909 | 3.896 | −0.011 | 0.994 | 3.896 |
| 0.659 | 1.004 | 3.896 | −1.837 | 0.916 | 3.896 | 0.073 | 1.003 | 3.896 |
| 0.601 | 0.983 | 3.896 | −1.843 | 0.923 | 3.896 | 0.155 | 1.011 | 3.896 |
| 0.537 | 0.961 | 3.896 | −1.847 | 0.929 | 3.896 | 0.234 | 1.021 | 3.896 |
| 0.471 | 0.939 | 3.896 | −1.849 | 0.935 | 3.896 | 0.310 | 1.031 | 3.896 |
| 0.401 | 0.916 | 3.896 | −1.849 | 0.939 | 3.896 | 0.384 | 1.041 | 3.896 |
| 0.328 | 0.893 | 3.896 | −1.847 | 0.943 | 3.896 | 0.454 | 1.052 | 3.896 |
| 0.252 | 0.871 | 3.896 | −1.844 | 0.948 | 3.896 | 0.521 | 1.063 | 3.896 |
| 0.173 | 0.849 | 3.896 | −1.838 | 0.952 | 3.896 | 0.585 | 1.075 | 3.896 |
| 0.090 | 0.828 | 3.896 | −1.830 | 0.956 | 3.896 | 0.644 | 1.086 | 3.896 |
| 0.005 | 0.807 | 3.896 | −1.820 | 0.959 | 3.896 | 0.697 | 1.097 | 3.896 |
| −0.081 | 0.789 | 3.896 | −1.805 | 0.962 | 3.896 | 0.744 | 1.107 | 3.896 |
| −0.168 | 0.771 | 3.896 | −1.787 | 0.964 | 3.896 | 0.786 | 1.117 | 3.896 |
| −0.254 | 0.756 | 3.896 | −1.764 | 0.966 | 3.896 | 0.822 | 1.125 | 3.896 |
| −0.341 | 0.743 | 3.896 | −1.738 | 0.966 | 3.896 | 0.852 | 1.132 | 3.896 |
| −0.429 | 0.732 | 3.896 | −1.706 | 0.966 | 3.896 | 0.878 | 1.138 | 3.896 |
| −0.516 | 0.723 | 3.896 | −1.669 | 0.966 | 3.896 | 0.900 | 1.144 | 3.896 |
| −0.604 | 0.717 | 3.896 | −1.627 | 0.965 | 3.896 | 0.918 | 1.148 | 3.896 |
| −0.692 | 0.713 | 3.896 | −1.578 | 0.963 | 3.896 | 0.932 | 1.152 | 3.896 |
| −0.780 | 0.712 | 3.896 | −1.524 | 0.961 | 3.896 | 0.943 | 1.155 | 3.896 |
| −0.868 | 0.713 | 3.896 | −1.465 | 0.959 | 3.896 | 0.952 | 1.154 | 3.896 |
| −0.956 | 0.717 | 3.896 | −1.399 | 0.957 | 3.896 | 0.958 | 1.150 | 3.896 |
| −1.041 | 0.722 | 3.896 | −1.331 | 0.955 | 3.896 | 0.962 | 1.146 | 3.896 |
| −1.122 | 0.730 | 3.896 | −1.260 | 0.953 | 3.896 | 0.963 | 1.142 | 3.896 |
| −1.201 | 0.739 | 3.896 | −1.186 | 0.951 | 3.896 | | | |
| −1.276 | 0.750 | 3.896 | −1.110 | 0.950 | 3.896 | | | |
| 1.058 | 0.994 | 4.526 | −1.250 | 0.670 | 4.526 | −0.931 | 0.827 | 4.526 |
| 1.057 | 0.988 | 4.526 | −1.318 | 0.684 | 4.526 | −0.849 | 0.825 | 4.526 |
| 1.054 | 0.981 | 4.526 | −1.383 | 0.699 | 4.526 | −0.764 | 0.824 | 4.526 |
| 1.048 | 0.975 | 4.526 | −1.442 | 0.715 | 4.526 | −0.679 | 0.823 | 4.526 |
| 1.037 | 0.971 | 4.526 | −1.496 | 0.730 | 4.526 | −0.594 | 0.824 | 4.526 |
| 1.023 | 0.965 | 4.526 | −1.543 | 0.744 | 4.526 | −0.509 | 0.825 | 4.526 |
| 1.005 | 0.958 | 4.526 | −1.585 | 0.758 | 4.526 | −0.424 | 0.827 | 4.526 |
| 0.984 | 0.950 | 4.526 | −1.621 | 0.771 | 4.526 | −0.339 | 0.830 | 4.526 |
| 0.958 | 0.940 | 4.526 | −1.651 | 0.782 | 4.526 | −0.254 | 0.834 | 4.526 |
| 0.928 | 0.929 | 4.526 | −1.676 | 0.793 | 4.526 | −0.169 | 0.838 | 4.526 |
| 0.893 | 0.915 | 4.526 | −1.697 | 0.802 | 4.526 | −0.085 | 0.843 | 4.526 |
| 0.852 | 0.901 | 4.526 | −1.714 | 0.811 | 4.526 | 0.000 | 0.849 | 4.526 |
| 0.805 | 0.884 | 4.526 | −1.726 | 0.820 | 4.526 | 0.085 | 0.855 | 4.526 |
| 0.752 | 0.866 | 4.526 | −1.736 | 0.827 | 4.526 | 0.169 | 0.863 | 4.526 |
| 0.694 | 0.847 | 4.526 | −1.742 | 0.834 | 4.526 | 0.251 | 0.871 | 4.526 |
| 0.630 | 0.826 | 4.526 | −1.746 | 0.840 | 4.526 | 0.330 | 0.880 | 4.526 |
| 0.563 | 0.806 | 4.526 | −1.748 | 0.845 | 4.526 | 0.406 | 0.889 | 4.526 |
| 0.493 | 0.785 | 4.526 | −1.748 | 0.850 | 4.526 | 0.479 | 0.899 | 4.526 |
| 0.420 | 0.764 | 4.526 | −1.746 | 0.854 | 4.526 | 0.549 | 0.910 | 4.526 |
| 0.344 | 0.744 | 4.526 | −1.742 | 0.858 | 4.526 | 0.616 | 0.921 | 4.526 |
| 0.265 | 0.724 | 4.526 | −1.736 | 0.862 | 4.526 | 0.680 | 0.932 | 4.526 |
| 0.183 | 0.705 | 4.526 | −1.728 | 0.865 | 4.526 | 0.738 | 0.943 | 4.526 |

TABLE 7S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.097 | 0.687 | 4.526 | −1.717 | 0.867 | 4.526 | 0.791 | 0.954 | 4.526 |
| 0.011 | 0.670 | 4.526 | −1.703 | 0.869 | 4.526 | 0.838 | 0.964 | 4.526 |
| −0.075 | 0.655 | 4.526 | −1.684 | 0.871 | 4.526 | 0.880 | 0.973 | 4.526 |
| −0.161 | 0.642 | 4.526 | −1.662 | 0.871 | 4.526 | 0.916 | 0.982 | 4.526 |
| −0.248 | 0.631 | 4.526 | −1.635 | 0.870 | 4.526 | 0.946 | 0.989 | 4.526 |
| −0.335 | 0.622 | 4.526 | −1.604 | 0.868 | 4.526 | 0.972 | 0.995 | 4.526 |
| −0.422 | 0.615 | 4.526 | −1.567 | 0.866 | 4.526 | 0.994 | 1.000 | 4.526 |
| −0.510 | 0.611 | 4.526 | −1.525 | 0.863 | 4.526 | 1.011 | 1.005 | 4.526 |
| −0.597 | 0.610 | 4.526 | −1.477 | 0.859 | 4.526 | 1.026 | 1.008 | 4.526 |
| −0.685 | 0.610 | 4.526 | −1.423 | 0.855 | 4.526 | 1.037 | 1.011 | 4.526 |
| −0.773 | 0.613 | 4.526 | −1.364 | 0.851 | 4.526 | 1.045 | 1.010 | 4.526 |
| −0.860 | 0.618 | 4.526 | −1.299 | 0.846 | 4.526 | 1.051 | 1.006 | 4.526 |
| −0.944 | 0.626 | 4.526 | −1.231 | 0.841 | 4.526 | 1.055 | 1.002 | 4.526 |
| −1.026 | 0.635 | 4.526 | −1.160 | 0.837 | 4.526 | 1.057 | 0.998 | 4.526 |
| −1.104 | 0.645 | 4.526 | −1.087 | 0.833 | 4.526 | | | |
| −1.178 | 0.657 | 4.526 | −1.010 | 0.830 | 4.526 | | | |
| 1.380 | 0.512 | 5.786 | −0.931 | 0.327 | 5.786 | −0.614 | 0.394 | 5.786 |
| 1.380 | 0.506 | 5.786 | −0.999 | 0.343 | 5.786 | −0.532 | 0.386 | 5.786 |
| 1.377 | 0.499 | 5.786 | −1.063 | 0.360 | 5.786 | −0.447 | 0.379 | 5.786 |
| 1.371 | 0.493 | 5.786 | −1.122 | 0.376 | 5.786 | −0.362 | 0.374 | 5.786 |
| 1.360 | 0.489 | 5.786 | −1.175 | 0.392 | 5.786 | −0.277 | 0.370 | 5.786 |
| 1.345 | 0.484 | 5.786 | −1.222 | 0.407 | 5.786 | −0.192 | 0.367 | 5.786 |
| 1.327 | 0.479 | 5.786 | −1.263 | 0.420 | 5.786 | −0.107 | 0.365 | 5.786 |
| 1.306 | 0.471 | 5.786 | −1.299 | 0.433 | 5.786 | −0.021 | 0.365 | 5.786 |
| 1.280 | 0.463 | 5.786 | −1.329 | 0.444 | 5.786 | 0.064 | 0.365 | 5.786 |
| 1.249 | 0.454 | 5.786 | −1.354 | 0.454 | 5.786 | 0.149 | 0.367 | 5.786 |
| 1.213 | 0.443 | 5.786 | −1.375 | 0.463 | 5.786 | 0.234 | 0.370 | 5.786 |
| 1.171 | 0.430 | 5.786 | −1.392 | 0.471 | 5.786 | 0.319 | 0.374 | 5.786 |
| 1.124 | 0.417 | 5.786 | −1.405 | 0.479 | 5.786 | 0.404 | 0.379 | 5.786 |
| 1.071 | 0.402 | 5.786 | −1.414 | 0.486 | 5.786 | 0.489 | 0.386 | 5.786 |
| 1.012 | 0.387 | 5.786 | −1.421 | 0.491 | 5.786 | 0.571 | 0.393 | 5.786 |
| 0.947 | 0.370 | 5.786 | −1.426 | 0.497 | 5.786 | 0.650 | 0.401 | 5.786 |
| 0.879 | 0.354 | 5.786 | −1.428 | 0.502 | 5.786 | 0.726 | 0.410 | 5.786 |
| 0.809 | 0.338 | 5.786 | −1.428 | 0.507 | 5.786 | 0.799 | 0.420 | 5.786 |
| 0.735 | 0.323 | 5.786 | −1.426 | 0.510 | 5.786 | 0.870 | 0.430 | 5.786 |
| 0.658 | 0.308 | 5.786 | −1.421 | 0.513 | 5.786 | 0.937 | 0.441 | 5.786 |
| 0.578 | 0.294 | 5.786 | −1.414 | 0.515 | 5.786 | 1.001 | 0.452 | 5.786 |
| 0.495 | 0.281 | 5.786 | −1.406 | 0.516 | 5.786 | 1.060 | 0.463 | 5.786 |
| 0.409 | 0.269 | 5.786 | −1.395 | 0.517 | 5.786 | 1.113 | 0.473 | 5.786 |
| 0.322 | 0.258 | 5.786 | −1.380 | 0.516 | 5.786 | 1.160 | 0.483 | 5.786 |
| 0.236 | 0.249 | 5.786 | −1.362 | 0.514 | 5.786 | 1.202 | 0.493 | 5.786 |
| 0.149 | 0.243 | 5.786 | −1.339 | 0.511 | 5.786 | 1.238 | 0.501 | 5.786 |
| 0.062 | 0.238 | 5.786 | −1.313 | 0.506 | 5.786 | 1.268 | 0.508 | 5.786 |
| −0.025 | 0.235 | 5.786 | −1.282 | 0.500 | 5.786 | 1.294 | 0.514 | 5.786 |
| −0.112 | 0.234 | 5.786 | −1.246 | 0.493 | 5.786 | 1.316 | 0.520 | 5.786 |
| −0.199 | 0.236 | 5.786 | −1.204 | 0.485 | 5.786 | 1.334 | 0.524 | 5.786 |
| −0.286 | 0.239 | 5.786 | −1.157 | 0.475 | 5.786 | 1.348 | 0.528 | 5.786 |
| −0.373 | 0.244 | 5.786 | −1.104 | 0.465 | 5.786 | 1.359 | 0.530 | 5.786 |
| −0.460 | 0.252 | 5.786 | −1.045 | 0.455 | 5.786 | 1.368 | 0.528 | 5.786 |
| −0.546 | 0.261 | 5.786 | −0.980 | 0.444 | 5.786 | 1.374 | 0.524 | 5.786 |
| −0.629 | 0.272 | 5.786 | −0.913 | 0.433 | 5.786 | 1.377 | 0.520 | 5.786 |
| −0.709 | 0.284 | 5.786 | −0.843 | 0.422 | 5.786 | 1.379 | 0.516 | 5.786 |
| −0.786 | 0.297 | 5.786 | −0.769 | 0.412 | 5.786 | | | |
| −0.860 | 0.312 | 5.786 | −0.693 | 0.403 | 5.786 | | | |
| 1.561 | 0.244 | 6.416 | −0.780 | 0.146 | 6.416 | −0.460 | 0.188 | 6.416 |
| 1.561 | 0.238 | 6.416 | −0.848 | 0.166 | 6.416 | −0.377 | 0.176 | 6.416 |
| 1.558 | 0.231 | 6.416 | −0.913 | 0.186 | 6.416 | −0.292 | 0.165 | 6.416 |
| 1.552 | 0.225 | 6.416 | −0.971 | 0.205 | 6.416 | −0.206 | 0.155 | 6.416 |
| 1.541 | 0.220 | 6.416 | −1.024 | 0.223 | 6.416 | −0.120 | 0.147 | 6.416 |
| 1.526 | 0.216 | 6.416 | −1.071 | 0.240 | 6.416 | −0.034 | 0.140 | 6.416 |
| 1.508 | 0.210 | 6.416 | −1.113 | 0.255 | 6.416 | 0.052 | 0.134 | 6.416 |
| 1.486 | 0.202 | 6.416 | −1.148 | 0.269 | 6.416 | 0.139 | 0.130 | 6.416 |
| 1.460 | 0.194 | 6.416 | −1.178 | 0.281 | 6.416 | 0.225 | 0.127 | 6.416 |
| 1.429 | 0.184 | 6.416 | −1.204 | 0.292 | 6.416 | 0.311 | 0.125 | 6.416 |
| 1.392 | 0.173 | 6.416 | −1.225 | 0.302 | 6.416 | 0.397 | 0.124 | 6.416 |
| 1.350 | 0.161 | 6.416 | −1.241 | 0.311 | 6.416 | 0.484 | 0.125 | 6.416 |
| 1.302 | 0.148 | 6.416 | −1.254 | 0.320 | 6.416 | 0.570 | 0.127 | 6.416 |
| 1.248 | 0.134 | 6.416 | −1.264 | 0.327 | 6.416 | 0.656 | 0.130 | 6.416 |
| 1.188 | 0.119 | 6.416 | −1.270 | 0.333 | 6.416 | 0.739 | 0.135 | 6.416 |
| 1.122 | 0.103 | 6.416 | −1.275 | 0.338 | 6.416 | 0.819 | 0.141 | 6.416 |
| 1.053 | 0.089 | 6.416 | −1.278 | 0.344 | 6.416 | 0.897 | 0.148 | 6.416 |
| 0.981 | 0.074 | 6.416 | −1.277 | 0.348 | 6.416 | 0.971 | 0.156 | 6.416 |
| 0.905 | 0.061 | 6.416 | −1.275 | 0.352 | 6.416 | 1.043 | 0.165 | 6.416 |
| 0.827 | 0.048 | 6.416 | −1.270 | 0.354 | 6.416 | 1.111 | 0.174 | 6.416 |
| 0.745 | 0.037 | 6.416 | −1.263 | 0.356 | 6.416 | 1.177 | 0.185 | 6.416 |
| 0.661 | 0.027 | 6.416 | −1.254 | 0.356 | 6.416 | 1.236 | 0.195 | 6.416 |
| 0.573 | 0.018 | 6.416 | −1.243 | 0.356 | 6.416 | 1.290 | 0.205 | 6.416 |

TABLE 7S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.485 | 0.012 | 6.416 | −1.228 | 0.354 | 6.416 | 1.338 | 0.215 | 6.416 |
| 0.397 | 0.007 | 6.416 | −1.209 | 0.351 | 6.416 | 1.380 | 0.224 | 6.416 |
| 0.309 | 0.004 | 6.416 | −1.187 | 0.346 | 6.416 | 1.417 | 0.232 | 6.416 |
| 0.221 | 0.004 | 6.416 | −1.161 | 0.340 | 6.416 | 1.448 | 0.240 | 6.416 |
| 0.133 | 0.006 | 6.416 | −1.130 | 0.332 | 6.416 | 1.474 | 0.246 | 6.416 |
| 0.045 | 0.010 | 6.416 | −1.094 | 0.322 | 6.416 | 1.496 | 0.252 | 6.416 |
| −0.043 | 0.015 | 6.416 | −1.052 | 0.312 | 6.416 | 1.514 | 0.256 | 6.416 |
| −0.131 | 0.023 | 6.416 | −1.004 | 0.300 | 6.416 | 1.529 | 0.260 | 6.416 |
| −0.219 | 0.033 | 6.416 | −0.951 | 0.287 | 6.416 | 1.540 | 0.262 | 6.416 |
| −0.306 | 0.045 | 6.416 | −0.892 | 0.273 | 6.416 | 1.549 | 0.260 | 6.416 |
| −0.394 | 0.059 | 6.416 | −0.828 | 0.258 | 6.416 | 1.555 | 0.256 | 6.416 |
| −0.477 | 0.075 | 6.416 | −0.760 | 0.243 | 6.416 | 1.558 | 0.252 | 6.416 |
| −0.558 | 0.091 | 6.416 | −0.690 | 0.229 | 6.416 | 1.560 | 0.248 | 6.416 |
| −0.635 | 0.109 | 6.416 | −0.616 | 0.215 | 6.416 | | | |
| −0.709 | 0.127 | 6.416 | −0.539 | 0.201 | 6.416 | | | |
| 1.744 | −0.027 | 7.046 | −0.731 | 0.068 | 7.046 | −0.390 | 0.076 | 7.046 |
| 1.743 | −0.033 | 7.046 | −0.800 | 0.097 | 7.046 | −0.305 | 0.054 | 7.046 |
| 1.740 | −0.040 | 7.046 | −0.866 | 0.126 | 7.046 | −0.216 | 0.033 | 7.046 |
| 1.732 | −0.046 | 7.046 | −0.926 | 0.153 | 7.046 | −0.127 | 0.013 | 7.046 |
| 1.720 | −0.050 | 7.046 | −0.979 | 0.179 | 7.046 | −0.037 | −0.005 | 7.046 |
| 1.705 | −0.055 | 7.046 | −1.027 | 0.202 | 7.046 | 0.053 | −0.021 | 7.046 |
| 1.685 | −0.061 | 7.046 | −1.069 | 0.224 | 7.046 | 0.143 | −0.036 | 7.046 |
| 1.662 | −0.068 | 7.046 | −1.104 | 0.243 | 7.046 | 0.233 | −0.049 | 7.046 |
| 1.634 | −0.077 | 7.046 | −1.135 | 0.259 | 7.046 | 0.324 | −0.060 | 7.046 |
| 1.601 | −0.086 | 7.046 | −1.160 | 0.273 | 7.046 | 0.415 | −0.070 | 7.046 |
| 1.561 | −0.097 | 7.046 | −1.181 | 0.286 | 7.046 | 0.506 | −0.079 | 7.046 |
| 1.516 | −0.109 | 7.046 | −1.198 | 0.298 | 7.046 | 0.597 | −0.086 | 7.046 |
| 1.464 | −0.121 | 7.046 | −1.211 | 0.308 | 7.046 | 0.688 | −0.091 | 7.046 |
| 1.406 | −0.134 | 7.046 | −1.220 | 0.316 | 7.046 | 0.779 | −0.095 | 7.046 |
| 1.342 | −0.148 | 7.046 | −1.226 | 0.323 | 7.046 | 0.868 | −0.097 | 7.046 |
| 1.271 | −0.161 | 7.046 | −1.231 | 0.330 | 7.046 | 0.953 | −0.097 | 7.046 |
| 1.197 | −0.173 | 7.046 | −1.233 | 0.336 | 7.046 | 1.035 | −0.095 | 7.046 |
| 1.120 | −0.184 | 7.046 | −1.232 | 0.340 | 7.046 | 1.115 | −0.092 | 7.046 |
| 1.039 | −0.194 | 7.046 | −1.229 | 0.344 | 7.046 | 1.191 | −0.087 | 7.046 |
| 0.955 | −0.202 | 7.046 | −1.223 | 0.346 | 7.046 | 1.264 | −0.081 | 7.046 |
| 0.868 | −0.209 | 7.046 | −1.216 | 0.347 | 7.046 | 1.334 | −0.074 | 7.046 |
| 0.778 | −0.213 | 7.046 | −1.207 | 0.346 | 7.046 | 1.397 | −0.066 | 7.046 |
| 0.684 | −0.215 | 7.046 | −1.195 | 0.344 | 7.046 | 1.454 | −0.058 | 7.046 |
| 0.590 | −0.214 | 7.046 | −1.179 | 0.341 | 7.046 | 1.506 | −0.050 | 7.046 |
| 0.497 | −0.211 | 7.046 | −1.160 | 0.335 | 7.046 | 1.551 | −0.042 | 7.046 |
| 0.403 | −0.205 | 7.046 | −1.137 | 0.327 | 7.046 | 1.590 | −0.035 | 7.046 |
| 0.310 | −0.197 | 7.046 | −1.110 | 0.317 | 7.046 | 1.623 | −0.029 | 7.046 |
| 0.217 | −0.186 | 7.046 | −1.079 | 0.305 | 7.046 | 1.651 | −0.023 | 7.046 |
| 0.124 | −0.173 | 7.046 | −1.042 | 0.291 | 7.046 | 1.675 | −0.018 | 7.046 |
| 0.032 | −0.157 | 7.046 | −0.999 | 0.275 | 7.046 | 1.694 | −0.013 | 7.046 |
| −0.060 | −0.139 | 7.046 | −0.951 | 0.257 | 7.046 | 1.709 | −0.010 | 7.046 |
| −0.152 | −0.119 | 7.046 | −0.896 | 0.237 | 7.046 | 1.721 | −0.008 | 7.046 |
| −0.243 | −0.096 | 7.046 | −0.836 | 0.216 | 7.046 | 1.730 | −0.009 | 7.046 |
| −0.333 | −0.071 | 7.046 | −0.769 | 0.192 | 7.046 | 1.737 | −0.013 | 7.046 |
| −0.420 | −0.045 | 7.046 | −0.700 | 0.169 | 7.046 | 1.741 | −0.018 | 7.046 |
| −0.503 | −0.018 | 7.046 | −0.628 | 0.145 | 7.046 | 1.743 | −0.022 | 7.046 |
| −0.583 | 0.010 | 7.046 | −0.552 | 0.122 | 7.046 | | | |
| −0.658 | 0.039 | 7.046 | −0.473 | 0.099 | 7.046 | | | |

The coordinate values given in TABLE 8S below provide the nominal profile envelope, for an exemplary eighth stage stator.

TABLE 8S

| X-LOC | Y-LOC | Z-LOC | X-LOC | Y-LOC | Z-LOC | X-LOC | Y-LOC | Z-LOC |
|---|---|---|---|---|---|---|---|---|
| 1.700 | 0.215 | 0.000 | −0.955 | −0.053 | 0.000 | −0.559 | 0.052 | 0.000 |
| 1.700 | 0.213 | 0.000 | −1.030 | −0.021 | 0.000 | −0.465 | 0.039 | 0.000 |
| 1.701 | 0.211 | 0.000 | −1.100 | 0.013 | 0.000 | −0.369 | 0.027 | 0.000 |
| 1.701 | 0.205 | 0.000 | −1.164 | 0.045 | 0.000 | −0.272 | 0.019 | 0.000 |
| 1.697 | 0.197 | 0.000 | −1.220 | 0.077 | 0.000 | −0.175 | 0.013 | 0.000 |
| 1.685 | 0.188 | 0.000 | −1.270 | 0.106 | 0.000 | −0.079 | 0.009 | 0.000 |
| 1.666 | 0.181 | 0.000 | −1.313 | 0.132 | 0.000 | 0.017 | 0.008 | 0.000 |
| 1.641 | 0.171 | 0.000 | −1.350 | 0.157 | 0.000 | 0.114 | 0.009 | 0.000 |
| 1.609 | 0.159 | 0.000 | −1.381 | 0.179 | 0.000 | 0.210 | 0.011 | 0.000 |
| 1.568 | 0.143 | 0.000 | −1.406 | 0.199 | 0.000 | 0.306 | 0.015 | 0.000 |
| 1.520 | 0.124 | 0.000 | −1.427 | 0.216 | 0.000 | 0.402 | 0.021 | 0.000 |

TABLE 8S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.469 | 0.105 | 0.000 | −1.444 | 0.231 | 0.000 | 0.498 | 0.028 | 0.000 |
| 1.412 | 0.083 | 0.000 | −1.456 | 0.244 | 0.000 | 0.594 | 0.036 | 0.000 |
| 1.348 | 0.059 | 0.000 | −1.463 | 0.255 | 0.000 | 0.690 | 0.047 | 0.000 |
| 1.278 | 0.032 | 0.000 | −1.468 | 0.265 | 0.000 | 0.783 | 0.058 | 0.000 |
| 1.205 | 0.005 | 0.000 | −1.469 | 0.273 | 0.000 | 0.872 | 0.070 | 0.000 |
| 1.128 | −0.023 | 0.000 | −1.469 | 0.280 | 0.000 | 0.959 | 0.082 | 0.000 |
| 1.047 | −0.051 | 0.000 | −1.467 | 0.285 | 0.000 | 1.042 | 0.096 | 0.000 |
| 0.964 | −0.079 | 0.000 | −1.464 | 0.289 | 0.000 | 1.121 | 0.110 | 0.000 |
| 0.876 | −0.107 | 0.000 | −1.459 | 0.292 | 0.000 | 1.198 | 0.124 | 0.000 |
| 0.785 | −0.134 | 0.000 | −1.451 | 0.295 | 0.000 | 1.271 | 0.139 | 0.000 |
| 0.689 | −0.160 | 0.000 | −1.441 | 0.296 | 0.000 | 1.340 | 0.153 | 0.000 |
| 0.590 | −0.183 | 0.000 | −1.428 | 0.296 | 0.000 | 1.403 | 0.167 | 0.000 |
| 0.490 | −0.204 | 0.000 | −1.412 | 0.293 | 0.000 | 1.460 | 0.180 | 0.000 |
| 0.389 | −0.221 | 0.000 | −1.391 | 0.287 | 0.000 | 1.511 | 0.191 | 0.000 |
| 0.288 | −0.234 | 0.000 | −1.367 | 0.279 | 0.000 | 1.558 | 0.202 | 0.000 |
| 0.187 | −0.243 | 0.000 | −1.338 | 0.270 | 0.000 | 1.599 | 0.212 | 0.000 |
| 0.085 | −0.248 | 0.000 | −1.304 | 0.258 | 0.000 | 1.630 | 0.220 | 0.000 |
| −0.017 | −0.248 | 0.000 | −1.264 | 0.244 | 0.000 | 1.656 | 0.226 | 0.000 |
| −0.119 | −0.244 | 0.000 | −1.218 | 0.227 | 0.000 | 1.675 | 0.230 | 0.000 |
| −0.221 | −0.237 | 0.000 | −1.166 | 0.208 | 0.000 | 1.689 | 0.229 | 0.000 |
| −0.321 | −0.225 | 0.000 | −1.107 | 0.189 | 0.000 | 1.695 | 0.224 | 0.000 |
| −0.421 | −0.209 | 0.000 | −1.042 | 0.168 | 0.000 | 1.698 | 0.220 | 0.000 |
| −0.520 | −0.189 | 0.000 | −0.971 | 0.146 | 0.000 | 1.699 | 0.217 | 0.000 |
| −0.615 | −0.167 | 0.000 | −0.895 | 0.125 | 0.000 | 1.700 | 0.216 | 0.000 |
| −0.706 | −0.142 | 0.000 | −0.817 | 0.105 | 0.000 | 1.700 | 0.215 | 0.000 |
| −0.793 | −0.114 | 0.000 | −0.734 | 0.086 | 0.000 | | | |
| −0.876 | −0.085 | 0.000 | −0.649 | 0.068 | 0.000 | | | |
| 1.499 | 0.509 | 0.617 | −0.960 | 0.009 | 0.617 | −0.611 | 0.163 | 0.617 |
| 1.499 | 0.508 | 0.617 | −1.034 | 0.025 | 0.617 | −0.523 | 0.164 | 0.617 |
| 1.500 | 0.505 | 0.617 | −1.104 | 0.042 | 0.617 | −0.431 | 0.167 | 0.617 |
| 1.500 | 0.500 | 0.617 | −1.168 | 0.059 | 0.617 | −0.340 | 0.172 | 0.617 |
| 1.498 | 0.492 | 0.617 | −1.225 | 0.076 | 0.617 | −0.249 | 0.178 | 0.617 |
| 1.488 | 0.483 | 0.617 | −1.276 | 0.093 | 0.617 | −0.159 | 0.186 | 0.617 |
| 1.470 | 0.475 | 0.617 | −1.320 | 0.109 | 0.617 | −0.068 | 0.195 | 0.617 |
| 1.447 | 0.465 | 0.617 | −1.359 | 0.124 | 0.617 | 0.022 | 0.205 | 0.617 |
| 1.418 | 0.453 | 0.617 | −1.391 | 0.138 | 0.617 | 0.112 | 0.216 | 0.617 |
| 1.380 | 0.437 | 0.617 | −1.418 | 0.150 | 0.617 | 0.202 | 0.229 | 0.617 |
| 1.336 | 0.419 | 0.617 | −1.440 | 0.162 | 0.617 | 0.292 | 0.242 | 0.617 |
| 1.290 | 0.399 | 0.617 | −1.458 | 0.172 | 0.617 | 0.382 | 0.257 | 0.617 |
| 1.238 | 0.377 | 0.617 | −1.471 | 0.182 | 0.617 | 0.471 | 0.272 | 0.617 |
| 1.179 | 0.353 | 0.617 | −1.481 | 0.190 | 0.617 | 0.561 | 0.289 | 0.617 |
| 1.115 | 0.327 | 0.617 | −1.487 | 0.197 | 0.617 | 0.647 | 0.306 | 0.617 |
| 1.048 | 0.299 | 0.617 | −1.491 | 0.204 | 0.617 | 0.730 | 0.324 | 0.617 |
| 0.978 | 0.271 | 0.617 | −1.492 | 0.210 | 0.617 | 0.810 | 0.342 | 0.617 |
| 0.904 | 0.243 | 0.617 | −1.492 | 0.215 | 0.617 | 0.887 | 0.360 | 0.617 |
| 0.828 | 0.213 | 0.617 | −1.490 | 0.219 | 0.617 | 0.961 | 0.378 | 0.617 |
| 0.748 | 0.184 | 0.617 | −1.485 | 0.223 | 0.617 | 1.032 | 0.396 | 0.617 |
| 0.665 | 0.154 | 0.617 | −1.478 | 0.227 | 0.617 | 1.100 | 0.414 | 0.617 |
| 0.578 | 0.125 | 0.617 | −1.469 | 0.229 | 0.617 | 1.164 | 0.432 | 0.617 |
| 0.488 | 0.097 | 0.617 | −1.457 | 0.231 | 0.617 | 1.223 | 0.449 | 0.617 |
| 0.397 | 0.071 | 0.617 | −1.441 | 0.231 | 0.617 | 1.276 | 0.464 | 0.617 |
| 0.305 | 0.047 | 0.617 | −1.422 | 0.231 | 0.617 | 1.323 | 0.478 | 0.617 |
| 0.213 | 0.025 | 0.617 | −1.397 | 0.228 | 0.617 | 1.366 | 0.491 | 0.617 |
| 0.121 | 0.007 | 0.617 | −1.369 | 0.225 | 0.617 | 1.404 | 0.502 | 0.617 |
| 0.028 | −0.009 | 0.617 | −1.336 | 0.221 | 0.617 | 1.434 | 0.511 | 0.617 |
| −0.066 | −0.022 | 0.617 | −1.296 | 0.216 | 0.617 | 1.457 | 0.518 | 0.617 |
| −0.160 | −0.032 | 0.617 | −1.251 | 0.210 | 0.617 | 1.474 | 0.523 | 0.617 |
| −0.255 | −0.039 | 0.617 | −1.199 | 0.203 | 0.617 | 1.488 | 0.522 | 0.617 |
| −0.349 | −0.042 | 0.617 | −1.141 | 0.196 | 0.617 | 1.494 | 0.517 | 0.617 |
| −0.444 | −0.043 | 0.617 | −1.078 | 0.189 | 0.617 | 1.497 | 0.513 | 0.617 |
| −0.538 | −0.041 | 0.617 | −1.008 | 0.182 | 0.617 | 1.498 | 0.511 | 0.617 |
| −0.629 | −0.035 | 0.617 | −0.935 | 0.176 | 0.617 | 1.498 | 0.510 | 0.617 |
| −0.717 | −0.028 | 0.617 | −0.858 | 0.171 | 0.617 | 1.499 | 0.509 | 0.617 |
| −0.802 | −0.017 | 0.617 | −0.779 | 0.167 | 0.617 | | | |
| −0.883 | −0.005 | 0.617 | −0.697 | 0.164 | 0.617 | | | |
| 1.339 | 0.728 | 1.234 | −1.044 | 0.188 | 1.234 | −0.714 | 0.333 | 1.234 |
| 1.339 | 0.726 | 1.234 | −1.116 | 0.200 | 1.234 | −0.628 | 0.337 | 1.234 |
| 1.340 | 0.724 | 1.234 | −1.186 | 0.212 | 1.234 | −0.539 | 0.342 | 1.234 |
| 1.340 | 0.719 | 1.234 | −1.248 | 0.226 | 1.234 | −0.450 | 0.349 | 1.234 |
| 1.338 | 0.712 | 1.234 | −1.305 | 0.240 | 1.234 | −0.362 | 0.358 | 1.234 |
| 1.329 | 0.702 | 1.234 | −1.355 | 0.253 | 1.234 | −0.273 | 0.368 | 1.234 |
| 1.312 | 0.695 | 1.234 | −1.399 | 0.266 | 1.234 | −0.185 | 0.379 | 1.234 |
| 1.289 | 0.685 | 1.234 | −1.437 | 0.278 | 1.234 | −0.096 | 0.392 | 1.234 |
| 1.261 | 0.673 | 1.234 | −1.469 | 0.289 | 1.234 | −0.008 | 0.405 | 1.234 |
| 1.224 | 0.658 | 1.234 | −1.496 | 0.299 | 1.234 | 0.079 | 0.420 | 1.234 |
| 1.182 | 0.640 | 1.234 | −1.519 | 0.308 | 1.234 | 0.167 | 0.436 | 1.234 |
| 1.137 | 0.620 | 1.234 | −1.537 | 0.317 | 1.234 | 0.254 | 0.453 | 1.234 |

TABLE 8S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.087 | 0.598 | 1.234 | −1.550 | 0.325 | 1.234 | 0.342 | 0.470 | 1.234 |
| 1.030 | 0.574 | 1.234 | −1.560 | 0.332 | 1.234 | 0.429 | 0.489 | 1.234 |
| 0.968 | 0.548 | 1.234 | −1.567 | 0.338 | 1.234 | 0.513 | 0.508 | 1.234 |
| 0.903 | 0.521 | 1.234 | −1.572 | 0.345 | 1.234 | 0.593 | 0.528 | 1.234 |
| 0.835 | 0.493 | 1.234 | −1.574 | 0.351 | 1.234 | 0.671 | 0.548 | 1.234 |
| 0.764 | 0.465 | 1.234 | −1.574 | 0.355 | 1.234 | 0.746 | 0.568 | 1.234 |
| 0.690 | 0.436 | 1.234 | −1.572 | 0.359 | 1.234 | 0.818 | 0.588 | 1.234 |
| 0.612 | 0.407 | 1.234 | −1.567 | 0.363 | 1.234 | 0.886 | 0.607 | 1.234 |
| 0.531 | 0.378 | 1.234 | −1.560 | 0.366 | 1.234 | 0.952 | 0.627 | 1.234 |
| 0.448 | 0.349 | 1.234 | −1.552 | 0.369 | 1.234 | 1.015 | 0.645 | 1.234 |
| 0.360 | 0.320 | 1.234 | −1.540 | 0.371 | 1.234 | 1.072 | 0.663 | 1.234 |
| 0.273 | 0.293 | 1.234 | −1.525 | 0.371 | 1.234 | 1.123 | 0.679 | 1.234 |
| 0.184 | 0.269 | 1.234 | −1.505 | 0.371 | 1.234 | 1.168 | 0.693 | 1.234 |
| 0.095 | 0.246 | 1.234 | −1.482 | 0.369 | 1.234 | 1.211 | 0.706 | 1.234 |
| 0.005 | 0.226 | 1.234 | −1.454 | 0.366 | 1.234 | 1.247 | 0.719 | 1.234 |
| −0.085 | 0.208 | 1.234 | −1.421 | 0.363 | 1.234 | 1.275 | 0.728 | 1.234 |
| −0.175 | 0.193 | 1.234 | −1.383 | 0.359 | 1.234 | 1.298 | 0.736 | 1.234 |
| −0.266 | 0.180 | 1.234 | −1.338 | 0.355 | 1.234 | 1.315 | 0.742 | 1.234 |
| −0.357 | 0.171 | 1.234 | −1.288 | 0.351 | 1.234 | 1.328 | 0.740 | 1.234 |
| −0.449 | 0.164 | 1.234 | −1.232 | 0.346 | 1.234 | 1.334 | 0.736 | 1.234 |
| −0.541 | 0.160 | 1.234 | −1.169 | 0.341 | 1.234 | 1.337 | 0.732 | 1.234 |
| −0.632 | 0.158 | 1.234 | −1.101 | 0.337 | 1.234 | 1.338 | 0.730 | 1.234 |
| −0.721 | 0.160 | 1.234 | −1.030 | 0.334 | 1.234 | 1.339 | 0.729 | 1.234 |
| −0.807 | 0.164 | 1.234 | −0.955 | 0.332 | 1.234 | 1.339 | 0.728 | 1.234 |
| −0.889 | 0.170 | 1.234 | −0.878 | 0.331 | 1.234 | | | |
| −0.968 | 0.178 | 1.234 | −0.798 | 0.331 | 1.234 | | | |
| 1.216 | 0.910 | 2.057 | −1.129 | 0.403 | 2.057 | −0.805 | 0.536 | 2.057 |
| 1.217 | 0.909 | 2.057 | −1.200 | 0.415 | 2.057 | −0.721 | 0.539 | 2.057 |
| 1.217 | 0.907 | 2.057 | −1.268 | 0.427 | 2.057 | −0.633 | 0.543 | 2.057 |
| 1.217 | 0.902 | 2.057 | −1.330 | 0.441 | 2.057 | −0.546 | 0.549 | 2.057 |
| 1.215 | 0.895 | 2.057 | −1.385 | 0.454 | 2.057 | −0.458 | 0.557 | 2.057 |
| 1.206 | 0.885 | 2.057 | −1.435 | 0.467 | 2.057 | −0.371 | 0.566 | 2.057 |
| 1.190 | 0.878 | 2.057 | −1.478 | 0.480 | 2.057 | −0.284 | 0.577 | 2.057 |
| 1.168 | 0.869 | 2.057 | −1.515 | 0.491 | 2.057 | −0.197 | 0.588 | 2.057 |
| 1.140 | 0.858 | 2.057 | −1.547 | 0.502 | 2.057 | −0.110 | 0.601 | 2.057 |
| 1.103 | 0.843 | 2.057 | −1.573 | 0.511 | 2.057 | −0.024 | 0.615 | 2.057 |
| 1.062 | 0.826 | 2.057 | −1.595 | 0.520 | 2.057 | 0.062 | 0.630 | 2.057 |
| 1.017 | 0.808 | 2.057 | −1.613 | 0.528 | 2.057 | 0.148 | 0.646 | 2.057 |
| 0.967 | 0.787 | 2.057 | −1.627 | 0.536 | 2.057 | 0.234 | 0.663 | 2.057 |
| 0.912 | 0.764 | 2.057 | −1.637 | 0.543 | 2.057 | 0.320 | 0.681 | 2.057 |
| 0.850 | 0.739 | 2.057 | −1.643 | 0.549 | 2.057 | 0.403 | 0.699 | 2.057 |
| 0.786 | 0.713 | 2.057 | −1.648 | 0.555 | 2.057 | 0.482 | 0.718 | 2.057 |
| 0.719 | 0.686 | 2.057 | −1.650 | 0.561 | 2.057 | 0.559 | 0.737 | 2.057 |
| 0.649 | 0.659 | 2.057 | −1.650 | 0.566 | 2.057 | 0.633 | 0.756 | 2.057 |
| 0.576 | 0.632 | 2.057 | −1.648 | 0.570 | 2.057 | 0.703 | 0.774 | 2.057 |
| 0.500 | 0.604 | 2.057 | −1.643 | 0.573 | 2.057 | 0.771 | 0.793 | 2.057 |
| 0.420 | 0.576 | 2.057 | −1.637 | 0.577 | 2.057 | 0.836 | 0.811 | 2.057 |
| 0.337 | 0.549 | 2.057 | −1.628 | 0.579 | 2.057 | 0.897 | 0.829 | 2.057 |
| 0.251 | 0.522 | 2.057 | −1.617 | 0.581 | 2.057 | 0.953 | 0.846 | 2.057 |
| 0.165 | 0.497 | 2.057 | −1.601 | 0.581 | 2.057 | 1.004 | 0.862 | 2.057 |
| 0.078 | 0.474 | 2.057 | −1.582 | 0.581 | 2.057 | 1.048 | 0.876 | 2.057 |
| −0.010 | 0.453 | 2.057 | −1.559 | 0.579 | 2.057 | 1.090 | 0.889 | 2.057 |
| −0.098 | 0.434 | 2.057 | −1.532 | 0.576 | 2.057 | 1.126 | 0.902 | 2.057 |
| −0.187 | 0.417 | 2.057 | −1.500 | 0.572 | 2.057 | 1.154 | 0.911 | 2.057 |
| −0.276 | 0.403 | 2.057 | −1.462 | 0.568 | 2.057 | 1.176 | 0.919 | 2.057 |
| −0.365 | 0.392 | 2.057 | −1.419 | 0.563 | 2.057 | 1.192 | 0.924 | 2.057 |
| −0.455 | 0.383 | 2.057 | −1.369 | 0.558 | 2.057 | 1.205 | 0.923 | 2.057 |
| −0.545 | 0.377 | 2.057 | −1.314 | 0.553 | 2.057 | 1.211 | 0.918 | 2.057 |
| −0.635 | 0.374 | 2.057 | −1.252 | 0.548 | 2.057 | 1.214 | 0.915 | 2.057 |
| −0.725 | 0.373 | 2.057 | −1.185 | 0.543 | 2.057 | 1.215 | 0.913 | 2.057 |
| −0.812 | 0.375 | 2.057 | −1.115 | 0.539 | 2.057 | 1.216 | 0.911 | 2.057 |
| −0.896 | 0.379 | 2.057 | −1.042 | 0.537 | 2.057 | 1.216 | 0.911 | 2.057 |
| −0.977 | 0.385 | 2.057 | −0.966 | 0.535 | 2.057 | | | |
| −1.055 | 0.393 | 2.057 | −0.887 | 0.535 | 2.057 | | | |
| 1.174 | 0.965 | 2.879 | −1.153 | 0.508 | 2.879 | −0.832 | 0.634 | 2.879 |
| 1.175 | 0.964 | 2.879 | −1.224 | 0.520 | 2.879 | −0.748 | 0.636 | 2.879 |
| 1.175 | 0.962 | 2.879 | −1.291 | 0.533 | 2.879 | −0.662 | 0.639 | 2.879 |
| 1.175 | 0.957 | 2.879 | −1.351 | 0.547 | 2.879 | −0.575 | 0.644 | 2.879 |
| 1.173 | 0.950 | 2.879 | −1.406 | 0.560 | 2.879 | −0.488 | 0.650 | 2.879 |
| 1.164 | 0.940 | 2.879 | −1.455 | 0.574 | 2.879 | −0.402 | 0.657 | 2.879 |
| 1.147 | 0.934 | 2.879 | −1.497 | 0.586 | 2.879 | −0.316 | 0.666 | 2.879 |
| 1.125 | 0.925 | 2.879 | −1.534 | 0.598 | 2.879 | −0.230 | 0.676 | 2.879 |
| 1.098 | 0.915 | 2.879 | −1.565 | 0.609 | 2.879 | −0.144 | 0.687 | 2.879 |
| 1.061 | 0.901 | 2.879 | −1.592 | 0.618 | 2.879 | −0.058 | 0.699 | 2.879 |
| 1.020 | 0.885 | 2.879 | −1.613 | 0.627 | 2.879 | 0.027 | 0.712 | 2.879 |
| 0.976 | 0.867 | 2.879 | −1.631 | 0.635 | 2.879 | 0.113 | 0.726 | 2.879 |
| 0.926 | 0.848 | 2.879 | −1.644 | 0.643 | 2.879 | 0.198 | 0.741 | 2.879 |

TABLE 8S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.871 | 0.826 | 2.879 | −1.654 | 0.650 | 2.879 | 0.283 | 0.757 | 2.879 |
| 0.810 | 0.802 | 2.879 | −1.661 | 0.656 | 2.879 | 0.365 | 0.773 | 2.879 |
| 0.746 | 0.778 | 2.879 | −1.665 | 0.662 | 2.879 | 0.445 | 0.790 | 2.879 |
| 0.679 | 0.753 | 2.879 | −1.667 | 0.668 | 2.879 | 0.521 | 0.807 | 2.879 |
| 0.609 | 0.728 | 2.879 | −1.667 | 0.672 | 2.879 | 0.594 | 0.824 | 2.879 |
| 0.536 | 0.702 | 2.879 | −1.665 | 0.676 | 2.879 | 0.664 | 0.841 | 2.879 |
| 0.460 | 0.676 | 2.879 | −1.661 | 0.680 | 2.879 | 0.732 | 0.858 | 2.879 |
| 0.381 | 0.651 | 2.879 | −1.654 | 0.683 | 2.879 | 0.796 | 0.875 | 2.879 |
| 0.299 | 0.625 | 2.879 | −1.646 | 0.685 | 2.879 | 0.857 | 0.891 | 2.879 |
| 0.213 | 0.601 | 2.879 | −1.634 | 0.687 | 2.879 | 0.913 | 0.907 | 2.879 |
| 0.127 | 0.578 | 2.879 | −1.619 | 0.687 | 2.879 | 0.963 | 0.921 | 2.879 |
| 0.040 | 0.557 | 2.879 | −1.600 | 0.686 | 2.879 | 1.008 | 0.934 | 2.879 |
| −0.047 | 0.538 | 2.879 | −1.578 | 0.684 | 2.879 | 1.049 | 0.947 | 2.879 |
| −0.134 | 0.521 | 2.879 | −1.551 | 0.681 | 2.879 | 1.085 | 0.958 | 2.879 |
| −0.222 | 0.507 | 2.879 | −1.519 | 0.677 | 2.879 | 1.112 | 0.967 | 2.879 |
| −0.310 | 0.495 | 2.879 | −1.482 | 0.673 | 2.879 | 1.134 | 0.974 | 2.879 |
| −0.399 | 0.485 | 2.879 | −1.438 | 0.668 | 2.879 | 1.151 | 0.980 | 2.879 |
| −0.487 | 0.478 | 2.879 | −1.389 | 0.663 | 2.879 | 1.164 | 0.978 | 2.879 |
| −0.576 | 0.474 | 2.879 | −1.335 | 0.657 | 2.879 | 1.169 | 0.973 | 2.879 |
| −0.666 | 0.472 | 2.879 | −1.274 | 0.652 | 2.879 | 1.172 | 0.970 | 2.879 |
| −0.755 | 0.472 | 2.879 | −1.208 | 0.646 | 2.879 | 1.173 | 0.967 | 2.879 |
| −0.841 | 0.475 | 2.879 | −1.138 | 0.642 | 2.879 | 1.174 | 0.966 | 2.879 |
| −0.924 | 0.481 | 2.879 | −1.066 | 0.638 | 2.879 | 1.174 | 0.966 | 2.879 |
| −1.003 | 0.488 | 2.879 | −0.991 | 0.636 | 2.879 | | | |
| −1.080 | 0.497 | 2.879 | −0.913 | 0.634 | 2.879 | | | |
| 1.198 | 0.922 | 3.702 | −1.109 | 0.516 | 3.702 | −0.791 | 0.631 | 3.702 |
| 1.198 | 0.920 | 3.702 | −1.179 | 0.529 | 3.702 | −0.708 | 0.631 | 3.702 |
| 1.199 | 0.918 | 3.702 | −1.245 | 0.543 | 3.702 | −0.623 | 0.633 | 3.702 |
| 1.199 | 0.913 | 3.702 | −1.305 | 0.557 | 3.702 | −0.537 | 0.636 | 3.702 |
| 1.197 | 0.906 | 3.702 | −1.359 | 0.571 | 3.702 | −0.451 | 0.640 | 3.702 |
| 1.187 | 0.897 | 3.702 | −1.406 | 0.584 | 3.702 | −0.366 | 0.646 | 3.702 |
| 1.171 | 0.891 | 3.702 | −1.449 | 0.597 | 3.702 | −0.280 | 0.652 | 3.702 |
| 1.149 | 0.883 | 3.702 | −1.485 | 0.609 | 3.702 | −0.195 | 0.660 | 3.702 |
| 1.121 | 0.873 | 3.702 | −1.515 | 0.619 | 3.702 | −0.110 | 0.669 | 3.702 |
| 1.086 | 0.860 | 3.702 | −1.541 | 0.629 | 3.702 | −0.025 | 0.679 | 3.702 |
| 1.044 | 0.845 | 3.702 | −1.563 | 0.637 | 3.702 | 0.060 | 0.691 | 3.702 |
| 1.000 | 0.828 | 3.702 | −1.580 | 0.645 | 3.702 | 0.145 | 0.703 | 3.702 |
| 0.951 | 0.810 | 3.702 | −1.594 | 0.653 | 3.702 | 0.229 | 0.716 | 3.702 |
| 0.896 | 0.790 | 3.702 | −1.603 | 0.660 | 3.702 | 0.314 | 0.730 | 3.702 |
| 0.835 | 0.768 | 3.702 | −1.610 | 0.665 | 3.702 | 0.395 | 0.745 | 3.702 |
| 0.771 | 0.745 | 3.702 | −1.614 | 0.671 | 3.702 | 0.474 | 0.760 | 3.702 |
| 0.705 | 0.722 | 3.702 | −1.616 | 0.677 | 3.702 | 0.550 | 0.775 | 3.702 |
| 0.635 | 0.699 | 3.702 | −1.616 | 0.681 | 3.702 | 0.622 | 0.791 | 3.702 |
| 0.563 | 0.675 | 3.702 | −1.614 | 0.685 | 3.702 | 0.692 | 0.807 | 3.702 |
| 0.487 | 0.652 | 3.702 | −1.610 | 0.689 | 3.702 | 0.759 | 0.822 | 3.702 |
| 0.409 | 0.628 | 3.702 | −1.603 | 0.691 | 3.702 | 0.823 | 0.838 | 3.702 |
| 0.327 | 0.605 | 3.702 | −1.595 | 0.693 | 3.702 | 0.884 | 0.853 | 3.702 |
| 0.242 | 0.583 | 3.702 | −1.584 | 0.695 | 3.702 | 0.939 | 0.868 | 3.702 |
| 0.156 | 0.563 | 3.702 | −1.569 | 0.695 | 3.702 | 0.989 | 0.881 | 3.702 |
| 0.070 | 0.544 | 3.702 | −1.550 | 0.693 | 3.702 | 1.033 | 0.893 | 3.702 |
| −0.016 | 0.527 | 3.702 | −1.528 | 0.691 | 3.702 | 1.074 | 0.905 | 3.702 |
| −0.103 | 0.513 | 3.702 | −1.501 | 0.687 | 3.702 | 1.110 | 0.916 | 3.702 |
| −0.190 | 0.500 | 3.702 | −1.470 | 0.683 | 3.702 | 1.137 | 0.925 | 3.702 |
| −0.277 | 0.490 | 3.702 | −1.433 | 0.679 | 3.702 | 1.159 | 0.931 | 3.702 |
| −0.365 | 0.483 | 3.702 | −1.390 | 0.673 | 3.702 | 1.175 | 0.936 | 3.702 |
| −0.452 | 0.477 | 3.702 | −1.342 | 0.668 | 3.702 | 1.188 | 0.934 | 3.702 |
| −0.540 | 0.475 | 3.702 | −1.288 | 0.661 | 3.702 | 1.193 | 0.929 | 3.702 |
| −0.628 | 0.474 | 3.702 | −1.228 | 0.655 | 3.702 | 1.196 | 0.926 | 3.702 |
| −0.716 | 0.476 | 3.702 | −1.163 | 0.649 | 3.702 | 1.197 | 0.924 | 3.702 |
| −0.801 | 0.481 | 3.702 | −1.094 | 0.643 | 3.702 | 1.198 | 0.923 | 3.702 |
| −0.883 | 0.487 | 3.702 | −1.023 | 0.639 | 3.702 | 1.198 | 0.922 | 3.702 |
| −0.962 | 0.495 | 3.702 | −0.948 | 0.635 | 3.702 | | | |
| −1.037 | 0.505 | 3.702 | −0.871 | 0.633 | 3.702 | | | |
| 1.238 | 0.859 | 4.113 | −1.063 | 0.489 | 4.113 | −0.746 | 0.593 | 4.113 |
| 1.238 | 0.858 | 4.113 | −1.131 | 0.502 | 4.113 | −0.663 | 0.592 | 4.113 |
| 1.238 | 0.855 | 4.113 | −1.197 | 0.516 | 4.113 | −0.578 | 0.592 | 4.113 |
| 1.238 | 0.851 | 4.113 | −1.257 | 0.530 | 4.113 | −0.493 | 0.594 | 4.113 |
| 1.236 | 0.844 | 4.113 | −1.310 | 0.544 | 4.113 | −0.407 | 0.597 | 4.113 |
| 1.227 | 0.834 | 4.113 | −1.358 | 0.557 | 4.113 | −0.322 | 0.602 | 4.113 |
| 1.210 | 0.828 | 4.113 | −1.400 | 0.570 | 4.113 | −0.237 | 0.608 | 4.113 |
| 1.188 | 0.821 | 4.113 | −1.436 | 0.582 | 4.113 | −0.152 | 0.614 | 4.113 |
| 1.161 | 0.811 | 4.113 | −1.466 | 0.593 | 4.113 | −0.067 | 0.622 | 4.113 |
| 1.125 | 0.799 | 4.113 | −1.492 | 0.602 | 4.113 | 0.017 | 0.631 | 4.113 |
| 1.084 | 0.784 | 4.113 | −1.513 | 0.611 | 4.113 | 0.102 | 0.641 | 4.113 |
| 1.040 | 0.769 | 4.113 | −1.530 | 0.618 | 4.113 | 0.187 | 0.652 | 4.113 |
| 0.990 | 0.751 | 4.113 | −1.544 | 0.626 | 4.113 | 0.271 | 0.664 | 4.113 |
| 0.935 | 0.732 | 4.113 | −1.553 | 0.632 | 4.113 | 0.355 | 0.678 | 4.113 |

TABLE 8S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.874 | 0.711 | 4.113 | −1.560 | 0.638 | 4.113 | 0.437 | 0.691 | 4.113 |
| 0.811 | 0.690 | 4.113 | −1.565 | 0.644 | 4.113 | 0.515 | 0.705 | 4.113 |
| 0.744 | 0.668 | 4.113 | −1.567 | 0.649 | 4.113 | 0.591 | 0.720 | 4.113 |
| 0.675 | 0.646 | 4.113 | −1.567 | 0.654 | 4.113 | 0.663 | 0.735 | 4.113 |
| 0.602 | 0.624 | 4.113 | −1.565 | 0.658 | 4.113 | 0.733 | 0.750 | 4.113 |
| 0.527 | 0.602 | 4.113 | −1.560 | 0.661 | 4.113 | 0.799 | 0.764 | 4.113 |
| 0.448 | 0.580 | 4.113 | −1.554 | 0.664 | 4.113 | 0.863 | 0.779 | 4.113 |
| 0.367 | 0.559 | 4.113 | −1.545 | 0.665 | 4.113 | 0.924 | 0.794 | 4.113 |
| 0.282 | 0.538 | 4.113 | −1.534 | 0.666 | 4.113 | 0.979 | 0.808 | 4.113 |
| 0.196 | 0.519 | 4.113 | −1.519 | 0.666 | 4.113 | 1.029 | 0.821 | 4.113 |
| 0.111 | 0.502 | 4.113 | −1.501 | 0.664 | 4.113 | 1.073 | 0.833 | 4.113 |
| 0.024 | 0.487 | 4.113 | −1.478 | 0.661 | 4.113 | 1.114 | 0.844 | 4.113 |
| −0.062 | 0.474 | 4.113 | −1.452 | 0.658 | 4.113 | 1.149 | 0.854 | 4.113 |
| −0.149 | 0.463 | 4.113 | −1.421 | 0.653 | 4.113 | 1.177 | 0.863 | 4.113 |
| −0.235 | 0.454 | 4.113 | −1.384 | 0.648 | 4.113 | 1.199 | 0.869 | 4.113 |
| −0.323 | 0.448 | 4.113 | −1.342 | 0.643 | 4.113 | 1.215 | 0.874 | 4.113 |
| −0.410 | 0.443 | 4.113 | −1.294 | 0.636 | 4.113 | 1.227 | 0.871 | 4.113 |
| −0.497 | 0.442 | 4.113 | −1.240 | 0.629 | 4.113 | 1.233 | 0.867 | 4.113 |
| −0.585 | 0.442 | 4.113 | −1.180 | 0.622 | 4.113 | 1.236 | 0.863 | 4.113 |
| −0.672 | 0.445 | 4.113 | −1.115 | 0.615 | 4.113 | 1.237 | 0.861 | 4.113 |
| −0.757 | 0.450 | 4.113 | −1.047 | 0.609 | 4.113 | 1.237 | 0.860 | 4.113 |
| −0.838 | 0.458 | 4.113 | −0.976 | 0.604 | 4.113 | 1.237 | 0.859 | 4.113 |
| −0.916 | 0.466 | 4.113 | −0.902 | 0.599 | 4.113 | | | |
| −0.991 | 0.477 | 4.113 | −0.826 | 0.596 | 4.113 | | | |
| 1.362 | 0.671 | 4.936 | −0.932 | 0.383 | 4.936 | −0.614 | 0.465 | 4.936 |
| 1.362 | 0.670 | 4.936 | −0.999 | 0.398 | 4.936 | −0.532 | 0.461 | 4.936 |
| 1.363 | 0.668 | 4.936 | −1.064 | 0.413 | 4.936 | −0.447 | 0.459 | 4.936 |
| 1.363 | 0.663 | 4.936 | −1.123 | 0.429 | 4.936 | −0.362 | 0.458 | 4.936 |
| 1.361 | 0.656 | 4.936 | −1.176 | 0.444 | 4.936 | −0.278 | 0.458 | 4.936 |
| 1.351 | 0.647 | 4.936 | −1.223 | 0.458 | 4.936 | −0.193 | 0.460 | 4.936 |
| 1.335 | 0.642 | 4.936 | −1.264 | 0.472 | 4.936 | −0.109 | 0.462 | 4.936 |
| 1.313 | 0.635 | 4.936 | −1.299 | 0.484 | 4.936 | −0.024 | 0.467 | 4.936 |
| 1.285 | 0.626 | 4.936 | −1.329 | 0.495 | 4.936 | 0.060 | 0.472 | 4.936 |
| 1.249 | 0.615 | 4.936 | −1.355 | 0.505 | 4.936 | 0.144 | 0.478 | 4.936 |
| 1.208 | 0.602 | 4.936 | −1.376 | 0.514 | 4.936 | 0.229 | 0.485 | 4.936 |
| 1.164 | 0.588 | 4.936 | −1.393 | 0.521 | 4.936 | 0.313 | 0.494 | 4.936 |
| 1.114 | 0.572 | 4.936 | −1.406 | 0.529 | 4.936 | 0.397 | 0.503 | 4.936 |
| 1.059 | 0.555 | 4.936 | −1.416 | 0.535 | 4.936 | 0.481 | 0.514 | 4.936 |
| 0.998 | 0.536 | 4.936 | −1.423 | 0.541 | 4.936 | 0.562 | 0.525 | 4.936 |
| 0.934 | 0.517 | 4.936 | −1.427 | 0.546 | 4.936 | 0.640 | 0.537 | 4.936 |
| 0.867 | 0.497 | 4.936 | −1.430 | 0.552 | 4.936 | 0.715 | 0.549 | 4.936 |
| 0.798 | 0.478 | 4.936 | −1.430 | 0.556 | 4.936 | 0.787 | 0.562 | 4.936 |
| 0.725 | 0.459 | 4.936 | −1.427 | 0.560 | 4.936 | 0.857 | 0.575 | 4.936 |
| 0.649 | 0.439 | 4.936 | −1.423 | 0.563 | 4.936 | 0.924 | 0.588 | 4.936 |
| 0.571 | 0.421 | 4.936 | −1.416 | 0.565 | 4.936 | 0.988 | 0.601 | 4.936 |
| 0.489 | 0.403 | 4.936 | −1.407 | 0.566 | 4.936 | 1.048 | 0.614 | 4.936 |
| 0.404 | 0.386 | 4.936 | −1.396 | 0.566 | 4.936 | 1.104 | 0.627 | 4.936 |
| 0.318 | 0.370 | 4.936 | −1.381 | 0.565 | 4.936 | 1.153 | 0.638 | 4.936 |
| 0.233 | 0.356 | 4.936 | −1.363 | 0.562 | 4.936 | 1.197 | 0.649 | 4.936 |
| 0.147 | 0.345 | 4.936 | −1.341 | 0.559 | 4.936 | 1.239 | 0.659 | 4.936 |
| 0.061 | 0.335 | 4.936 | −1.315 | 0.554 | 4.936 | 1.274 | 0.669 | 4.936 |
| −0.026 | 0.327 | 4.936 | −1.284 | 0.549 | 4.936 | 1.302 | 0.676 | 4.936 |
| −0.112 | 0.322 | 4.936 | −1.248 | 0.542 | 4.936 | 1.323 | 0.682 | 4.936 |
| −0.199 | 0.319 | 4.936 | −1.206 | 0.535 | 4.936 | 1.340 | 0.686 | 4.936 |
| −0.285 | 0.318 | 4.936 | −1.158 | 0.527 | 4.936 | 1.352 | 0.684 | 4.936 |
| −0.372 | 0.319 | 4.936 | −1.105 | 0.518 | 4.936 | 1.358 | 0.679 | 4.936 |
| −0.459 | 0.323 | 4.936 | −1.046 | 0.509 | 4.936 | 1.360 | 0.676 | 4.936 |
| −0.546 | 0.329 | 4.936 | −0.981 | 0.500 | 4.936 | 1.361 | 0.673 | 4.936 |
| −0.629 | 0.336 | 4.936 | −0.914 | 0.492 | 4.936 | 1.362 | 0.672 | 4.936 |
| −0.710 | 0.346 | 4.936 | −0.843 | 0.484 | 4.936 | 1.362 | 0.672 | 4.936 |
| −0.787 | 0.357 | 4.936 | −0.770 | 0.477 | 4.936 | | | |
| −0.861 | 0.369 | 4.936 | −0.694 | 0.471 | 4.936 | | | |
| 1.507 | 0.457 | 5.758 | −0.792 | 0.262 | 5.758 | −0.475 | 0.324 | 5.758 |
| 1.508 | 0.456 | 5.758 | −0.859 | 0.280 | 5.758 | −0.393 | 0.316 | 5.758 |
| 1.508 | 0.454 | 5.758 | −0.922 | 0.298 | 5.758 | −0.309 | 0.309 | 5.758 |
| 1.508 | 0.449 | 5.758 | −0.980 | 0.316 | 5.758 | −0.224 | 0.304 | 5.758 |
| 1.505 | 0.442 | 5.758 | −1.033 | 0.334 | 5.758 | −0.140 | 0.300 | 5.758 |
| 1.496 | 0.434 | 5.758 | −1.079 | 0.350 | 5.758 | −0.055 | 0.298 | 5.758 |
| 1.479 | 0.428 | 5.758 | −1.120 | 0.366 | 5.758 | 0.030 | 0.296 | 5.758 |
| 1.457 | 0.421 | 5.758 | −1.155 | 0.380 | 5.758 | 0.114 | 0.297 | 5.758 |
| 1.429 | 0.413 | 5.758 | −1.184 | 0.392 | 5.758 | 0.199 | 0.298 | 5.758 |
| 1.393 | 0.402 | 5.758 | −1.209 | 0.403 | 5.758 | 0.284 | 0.300 | 5.758 |
| 1.352 | 0.390 | 5.758 | −1.230 | 0.412 | 5.758 | 0.369 | 0.304 | 5.758 |
| 1.307 | 0.376 | 5.758 | −1.247 | 0.420 | 5.758 | 0.453 | 0.309 | 5.758 |
| 1.257 | 0.361 | 5.758 | −1.260 | 0.428 | 5.758 | 0.538 | 0.315 | 5.758 |
| 1.202 | 0.345 | 5.758 | −1.270 | 0.434 | 5.758 | 0.622 | 0.322 | 5.758 |
| 1.140 | 0.328 | 5.758 | −1.276 | 0.440 | 5.758 | 0.704 | 0.330 | 5.758 |

TABLE 8S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.076 | 0.310 | 5.758 | −1.281 | 0.446 | 5.758 | 0.782 | 0.339 | 5.758 |
| 1.009 | 0.293 | 5.758 | −1.283 | 0.451 | 5.758 | 0.858 | 0.349 | 5.758 |
| 0.938 | 0.275 | 5.758 | −1.283 | 0.455 | 5.758 | 0.931 | 0.360 | 5.758 |
| 0.865 | 0.258 | 5.758 | −1.281 | 0.459 | 5.758 | 1.001 | 0.371 | 5.758 |
| 0.788 | 0.242 | 5.758 | −1.276 | 0.461 | 5.758 | 1.068 | 0.382 | 5.758 |
| 0.709 | 0.226 | 5.758 | −1.269 | 0.463 | 5.758 | 1.132 | 0.394 | 5.758 |
| 0.626 | 0.211 | 5.758 | −1.260 | 0.464 | 5.758 | 1.193 | 0.405 | 5.758 |
| 0.540 | 0.197 | 5.758 | −1.249 | 0.463 | 5.758 | 1.248 | 0.417 | 5.758 |
| 0.454 | 0.186 | 5.758 | −1.234 | 0.461 | 5.758 | 1.298 | 0.427 | 5.758 |
| 0.368 | 0.176 | 5.758 | −1.216 | 0.457 | 5.758 | 1.342 | 0.437 | 5.758 |
| 0.281 | 0.169 | 5.758 | −1.195 | 0.452 | 5.758 | 1.383 | 0.447 | 5.758 |
| 0.194 | 0.163 | 5.758 | −1.169 | 0.446 | 5.758 | 1.419 | 0.456 | 5.758 |
| 0.107 | 0.160 | 5.758 | −1.138 | 0.440 | 5.758 | 1.447 | 0.463 | 5.758 |
| 0.021 | 0.159 | 5.758 | −1.102 | 0.432 | 5.758 | 1.469 | 0.469 | 5.758 |
| −0.066 | 0.160 | 5.758 | −1.061 | 0.423 | 5.758 | 1.485 | 0.473 | 5.758 |
| −0.153 | 0.164 | 5.758 | −1.014 | 0.412 | 5.758 | 1.497 | 0.470 | 5.758 |
| −0.240 | 0.170 | 5.758 | −0.961 | 0.401 | 5.758 | 1.503 | 0.465 | 5.758 |
| −0.326 | 0.178 | 5.758 | −0.903 | 0.389 | 5.758 | 1.505 | 0.462 | 5.758 |
| −0.411 | 0.188 | 5.758 | −0.839 | 0.377 | 5.758 | 1.506 | 0.460 | 5.758 |
| −0.494 | 0.200 | 5.758 | −0.772 | 0.365 | 5.758 | 1.507 | 0.458 | 5.758 |
| −0.573 | 0.213 | 5.758 | −0.702 | 0.354 | 5.758 | 1.507 | 0.458 | 5.758 |
| −0.649 | 0.228 | 5.758 | −0.629 | 0.343 | 5.758 | | | |
| −0.722 | 0.245 | 5.758 | −0.554 | 0.333 | 5.758 | | | |
| 1.566 | 0.341 | 6.170 | −0.741 | 0.231 | 6.170 | −0.422 | 0.276 | 6.170 |
| 1.566 | 0.340 | 6.170 | −0.807 | 0.252 | 6.170 | −0.340 | 0.265 | 6.170 |
| 1.566 | 0.338 | 6.170 | −0.870 | 0.274 | 6.170 | −0.256 | 0.254 | 6.170 |
| 1.566 | 0.333 | 6.170 | −0.927 | 0.294 | 6.170 | −0.172 | 0.245 | 6.170 |
| 1.564 | 0.326 | 6.170 | −0.978 | 0.314 | 6.170 | −0.087 | 0.237 | 6.170 |
| 1.554 | 0.318 | 6.170 | −1.024 | 0.333 | 6.170 | −0.003 | 0.231 | 6.170 |
| 1.537 | 0.313 | 6.170 | −1.064 | 0.351 | 6.170 | 0.082 | 0.226 | 6.170 |
| 1.515 | 0.306 | 6.170 | −1.098 | 0.367 | 6.170 | 0.167 | 0.222 | 6.170 |
| 1.487 | 0.299 | 6.170 | −1.127 | 0.380 | 6.170 | 0.252 | 0.220 | 6.170 |
| 1.451 | 0.288 | 6.170 | −1.151 | 0.392 | 6.170 | 0.337 | 0.219 | 6.170 |
| 1.409 | 0.277 | 6.170 | −1.172 | 0.403 | 6.170 | 0.422 | 0.220 | 6.170 |
| 1.364 | 0.264 | 6.170 | −1.189 | 0.412 | 6.170 | 0.507 | 0.222 | 6.170 |
| 1.313 | 0.250 | 6.170 | −1.202 | 0.419 | 6.170 | 0.591 | 0.225 | 6.170 |
| 1.257 | 0.235 | 6.170 | −1.211 | 0.426 | 6.170 | 0.676 | 0.229 | 6.170 |
| 1.195 | 0.219 | 6.170 | −1.217 | 0.432 | 6.170 | 0.758 | 0.235 | 6.170 |
| 1.131 | 0.203 | 6.170 | −1.222 | 0.438 | 6.170 | 0.837 | 0.242 | 6.170 |
| 1.063 | 0.187 | 6.170 | −1.224 | 0.443 | 6.170 | 0.913 | 0.249 | 6.170 |
| 0.992 | 0.171 | 6.170 | −1.224 | 0.448 | 6.170 | 0.986 | 0.258 | 6.170 |
| 0.918 | 0.156 | 6.170 | −1.221 | 0.451 | 6.170 | 1.056 | 0.267 | 6.170 |
| 0.841 | 0.142 | 6.170 | −1.216 | 0.453 | 6.170 | 1.124 | 0.276 | 6.170 |
| 0.761 | 0.128 | 6.170 | −1.209 | 0.455 | 6.170 | 1.188 | 0.286 | 6.170 |
| 0.677 | 0.116 | 6.170 | −1.200 | 0.454 | 6.170 | 1.250 | 0.296 | 6.170 |
| 0.591 | 0.105 | 6.170 | −1.189 | 0.453 | 6.170 | 1.305 | 0.306 | 6.170 |
| 0.504 | 0.097 | 6.170 | −1.175 | 0.450 | 6.170 | 1.355 | 0.316 | 6.170 |
| 0.417 | 0.090 | 6.170 | −1.157 | 0.445 | 6.170 | 1.400 | 0.325 | 6.170 |
| 0.330 | 0.086 | 6.170 | −1.135 | 0.439 | 6.170 | 1.442 | 0.334 | 6.170 |
| 0.243 | 0.084 | 6.170 | −1.110 | 0.432 | 6.170 | 1.477 | 0.342 | 6.170 |
| 0.156 | 0.085 | 6.170 | −1.080 | 0.424 | 6.170 | 1.505 | 0.348 | 6.170 |
| 0.069 | 0.088 | 6.170 | −1.044 | 0.414 | 6.170 | 1.527 | 0.353 | 6.170 |
| −0.018 | 0.094 | 6.170 | −1.003 | 0.403 | 6.170 | 1.544 | 0.357 | 6.170 |
| −0.104 | 0.101 | 6.170 | −0.956 | 0.390 | 6.170 | 1.556 | 0.354 | 6.170 |
| −0.191 | 0.111 | 6.170 | −0.904 | 0.377 | 6.170 | 1.562 | 0.349 | 6.170 |
| −0.277 | 0.124 | 6.170 | −0.847 | 0.362 | 6.170 | 1.564 | 0.346 | 6.170 |
| −0.363 | 0.138 | 6.170 | −0.783 | 0.347 | 6.170 | 1.565 | 0.344 | 6.170 |
| −0.445 | 0.154 | 6.170 | −0.717 | 0.332 | 6.170 | 1.565 | 0.343 | 6.170 |
| −0.524 | 0.172 | 6.170 | −0.648 | 0.317 | 6.170 | 1.566 | 0.342 | 6.170 |
| −0.599 | 0.190 | 6.170 | −0.575 | 0.303 | 6.170 | | | |
| −0.672 | 0.210 | 6.170 | −0.500 | 0.289 | 6.170 | | | |
| 1.615 | 0.225 | 6.581 | −0.713 | 0.253 | 6.581 | −0.391 | 0.263 | 6.581 |
| 1.615 | 0.223 | 6.581 | −0.778 | 0.281 | 6.581 | −0.310 | 0.243 | 6.581 |
| 1.615 | 0.221 | 6.581 | −0.839 | 0.309 | 6.581 | −0.226 | 0.225 | 6.581 |
| 1.615 | 0.216 | 6.581 | −0.894 | 0.336 | 6.581 | −0.142 | 0.208 | 6.581 |
| 1.613 | 0.209 | 6.581 | −0.944 | 0.362 | 6.581 | −0.058 | 0.193 | 6.581 |
| 1.602 | 0.201 | 6.581 | −0.988 | 0.385 | 6.581 | 0.027 | 0.181 | 6.581 |
| 1.585 | 0.196 | 6.581 | −1.027 | 0.407 | 6.581 | 0.112 | 0.169 | 6.581 |
| 1.563 | 0.190 | 6.581 | −1.060 | 0.426 | 6.581 | 0.197 | 0.160 | 6.581 |
| 1.534 | 0.182 | 6.581 | −1.088 | 0.443 | 6.581 | 0.283 | 0.152 | 6.581 |
| 1.497 | 0.172 | 6.581 | −1.111 | 0.458 | 6.581 | 0.369 | 0.146 | 6.581 |
| 1.454 | 0.161 | 6.581 | −1.131 | 0.470 | 6.581 | 0.455 | 0.142 | 6.581 |
| 1.409 | 0.149 | 6.581 | −1.147 | 0.481 | 6.581 | 0.540 | 0.139 | 6.581 |
| 1.358 | 0.136 | 6.581 | −1.160 | 0.489 | 6.581 | 0.626 | 0.137 | 6.581 |
| 1.300 | 0.121 | 6.581 | −1.169 | 0.497 | 6.581 | 0.712 | 0.138 | 6.581 |
| 1.237 | 0.106 | 6.581 | −1.175 | 0.504 | 6.581 | 0.795 | 0.140 | 6.581 |
| 1.171 | 0.092 | 6.581 | −1.179 | 0.510 | 6.581 | 0.875 | 0.143 | 6.581 |

TABLE 8S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.102 | 0.077 | 6.581 | −1.181 | 0.516 | 6.581 | 0.952 | 0.148 | 6.581 |
| 1.030 | 0.064 | 6.581 | −1.180 | 0.520 | 6.581 | 1.026 | 0.153 | 6.581 |
| 0.954 | 0.051 | 6.581 | −1.177 | 0.523 | 6.581 | 1.098 | 0.160 | 6.581 |
| 0.875 | 0.039 | 6.581 | −1.171 | 0.524 | 6.581 | 1.166 | 0.168 | 6.581 |
| 0.794 | 0.029 | 6.581 | −1.164 | 0.525 | 6.581 | 1.232 | 0.176 | 6.581 |
| 0.709 | 0.021 | 6.581 | −1.156 | 0.523 | 6.581 | 1.294 | 0.185 | 6.581 |
| 0.620 | 0.014 | 6.581 | −1.144 | 0.520 | 6.581 | 1.351 | 0.193 | 6.581 |
| 0.532 | 0.010 | 6.581 | −1.130 | 0.515 | 6.581 | 1.402 | 0.202 | 6.581 |
| 0.444 | 0.009 | 6.581 | −1.113 | 0.509 | 6.581 | 1.447 | 0.210 | 6.581 |
| 0.356 | 0.011 | 6.581 | −1.092 | 0.500 | 6.581 | 1.489 | 0.218 | 6.581 |
| 0.267 | 0.015 | 6.581 | −1.067 | 0.490 | 6.581 | 1.526 | 0.226 | 6.581 |
| 0.179 | 0.022 | 6.581 | −1.038 | 0.478 | 6.581 | 1.554 | 0.232 | 6.581 |
| 0.092 | 0.032 | 6.581 | −1.003 | 0.465 | 6.581 | 1.576 | 0.237 | 6.581 |
| 0.004 | 0.045 | 6.581 | −0.963 | 0.449 | 6.581 | 1.593 | 0.241 | 6.581 |
| −0.083 | 0.060 | 6.581 | −0.917 | 0.432 | 6.581 | 1.605 | 0.237 | 6.581 |
| −0.169 | 0.078 | 6.581 | −0.866 | 0.413 | 6.581 | 1.611 | 0.233 | 6.581 |
| −0.255 | 0.098 | 6.581 | −0.810 | 0.392 | 6.581 | 1.613 | 0.229 | 6.581 |
| −0.341 | 0.121 | 6.581 | −0.748 | 0.370 | 6.581 | 1.614 | 0.227 | 6.581 |
| −0.422 | 0.145 | 6.581 | −0.682 | 0.348 | 6.581 | 1.615 | 0.226 | 6.581 |
| −0.500 | 0.171 | 6.581 | −0.614 | 0.326 | 6.581 | 1.615 | 0.225 | 6.581 |
| −0.575 | 0.197 | 6.581 | −0.543 | 0.304 | 6.581 | | | |
| −0.646 | 0.225 | 6.581 | −0.468 | 0.283 | 6.581 | | | |

The coordinate values given in TABLE 9S below provide the nominal profile envelope for an exemplary ninth stage stator.

TABLE 9S

| X-LOC | Y-LOC | Z-LOC | X-LOC | Y-LOC | Z-LOC | X-LOC | Y-LOC | Z-LOC |
|---|---|---|---|---|---|---|---|---|
| 1.067 | 0.160 | 0.000 | −0.958 | −0.071 | 0.000 | −0.638 | 0.038 | 0.000 |
| 1.067 | 0.159 | 0.000 | −1.013 | −0.042 | 0.000 | −0.568 | 0.030 | 0.000 |
| 1.068 | 0.157 | 0.000 | −1.065 | −0.011 | 0.000 | −0.496 | 0.023 | 0.000 |
| 1.068 | 0.153 | 0.000 | −1.111 | 0.019 | 0.000 | −0.424 | 0.018 | 0.000 |
| 1.066 | 0.147 | 0.000 | −1.152 | 0.049 | 0.000 | −0.351 | 0.015 | 0.000 |
| 1.057 | 0.139 | 0.000 | −1.187 | 0.077 | 0.000 | −0.278 | 0.013 | 0.000 |
| 1.043 | 0.132 | 0.000 | −1.217 | 0.102 | 0.000 | −0.205 | 0.013 | 0.000 |
| 1.024 | 0.123 | 0.000 | −1.242 | 0.126 | 0.000 | −0.132 | 0.013 | 0.000 |
| 1.001 | 0.111 | 0.000 | −1.262 | 0.147 | 0.000 | −0.059 | 0.015 | 0.000 |
| 0.970 | 0.096 | 0.000 | −1.278 | 0.165 | 0.000 | 0.014 | 0.017 | 0.000 |
| 0.935 | 0.079 | 0.000 | −1.291 | 0.182 | 0.000 | 0.087 | 0.020 | 0.000 |
| 0.897 | 0.061 | 0.000 | −1.301 | 0.196 | 0.000 | 0.160 | 0.023 | 0.000 |
| 0.854 | 0.042 | 0.000 | −1.308 | 0.208 | 0.000 | 0.233 | 0.028 | 0.000 |
| 0.806 | 0.021 | 0.000 | −1.312 | 0.218 | 0.000 | 0.305 | 0.034 | 0.000 |
| 0.753 | −0.002 | 0.000 | −1.314 | 0.225 | 0.000 | 0.376 | 0.040 | 0.000 |
| 0.697 | −0.024 | 0.000 | −1.315 | 0.232 | 0.000 | 0.444 | 0.048 | 0.000 |
| 0.639 | −0.047 | 0.000 | −1.314 | 0.237 | 0.000 | 0.509 | 0.056 | 0.000 |
| 0.578 | −0.070 | 0.000 | −1.312 | 0.241 | 0.000 | 0.571 | 0.065 | 0.000 |
| 0.514 | −0.093 | 0.000 | −1.310 | 0.243 | 0.000 | 0.631 | 0.075 | 0.000 |
| 0.447 | −0.114 | 0.000 | −1.305 | 0.245 | 0.000 | 0.689 | 0.085 | 0.000 |
| 0.378 | −0.135 | 0.000 | −1.299 | 0.246 | 0.000 | 0.744 | 0.096 | 0.000 |
| 0.305 | −0.155 | 0.000 | −1.292 | 0.245 | 0.000 | 0.796 | 0.107 | 0.000 |
| 0.229 | −0.173 | 0.000 | −1.282 | 0.244 | 0.000 | 0.844 | 0.117 | 0.000 |
| 0.153 | −0.188 | 0.000 | −1.270 | 0.240 | 0.000 | 0.887 | 0.127 | 0.000 |
| 0.076 | −0.202 | 0.000 | −1.255 | 0.235 | 0.000 | 0.924 | 0.136 | 0.000 |
| −0.002 | −0.213 | 0.000 | −1.237 | 0.227 | 0.000 | 0.960 | 0.145 | 0.000 |
| −0.081 | −0.221 | 0.000 | −1.215 | 0.218 | 0.000 | 0.990 | 0.154 | 0.000 |
| −0.159 | −0.227 | 0.000 | −1.191 | 0.207 | 0.000 | 1.014 | 0.160 | 0.000 |
| −0.237 | −0.229 | 0.000 | −1.162 | 0.193 | 0.000 | 1.033 | 0.165 | 0.000 |
| −0.315 | −0.227 | 0.000 | −1.129 | 0.177 | 0.000 | 1.047 | 0.169 | 0.000 |
| −0.393 | −0.222 | 0.000 | −1.091 | 0.160 | 0.000 | 1.058 | 0.170 | 0.000 |
| −0.471 | −0.214 | 0.000 | −1.047 | 0.142 | 0.000 | 1.063 | 0.166 | 0.000 |
| −0.548 | −0.203 | 0.000 | −0.999 | 0.125 | 0.000 | 1.065 | 0.164 | 0.000 |
| −0.625 | −0.188 | 0.000 | −0.945 | 0.106 | 0.000 | 1.066 | 0.162 | 0.000 |
| −0.699 | −0.169 | 0.000 | −0.889 | 0.090 | 0.000 | 1.067 | 0.161 | 0.000 |
| −0.770 | −0.148 | 0.000 | −0.830 | 0.075 | 0.000 | 1.067 | 0.161 | 0.000 |
| −0.836 | −0.124 | 0.000 | −0.769 | 0.061 | 0.000 | | | |
| −0.898 | −0.099 | 0.000 | −0.704 | 0.049 | 0.000 | | | |
| 0.933 | 0.379 | 0.737 | −0.898 | −0.094 | 0.737 | −0.641 | 0.107 | 0.737 |
| 0.933 | 0.378 | 0.737 | −0.954 | −0.084 | 0.737 | −0.576 | 0.114 | 0.737 |
| 0.934 | 0.376 | 0.737 | −1.008 | −0.073 | 0.737 | −0.508 | 0.122 | 0.737 |
| 0.934 | 0.372 | 0.737 | −1.056 | −0.061 | 0.737 | −0.441 | 0.130 | 0.737 |

TABLE 9S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.933 | 0.366 | 0.737 | −1.100 | −0.047 | 0.737 | −0.373 | 0.139 | 0.737 |
| 0.925 | 0.358 | 0.737 | −1.138 | −0.034 | 0.737 | −0.306 | 0.148 | 0.737 |
| 0.913 | 0.352 | 0.737 | −1.171 | −0.021 | 0.737 | −0.239 | 0.157 | 0.737 |
| 0.896 | 0.344 | 0.737 | −1.200 | −0.008 | 0.737 | −0.171 | 0.166 | 0.737 |
| 0.874 | 0.333 | 0.737 | −1.223 | 0.004 | 0.737 | −0.104 | 0.176 | 0.737 |
| 0.847 | 0.319 | 0.737 | −1.243 | 0.015 | 0.737 | −0.037 | 0.186 | 0.737 |
| 0.815 | 0.304 | 0.737 | −1.259 | 0.025 | 0.737 | 0.030 | 0.196 | 0.737 |
| 0.780 | 0.288 | 0.737 | −1.271 | 0.035 | 0.737 | 0.097 | 0.206 | 0.737 |
| 0.742 | 0.270 | 0.737 | −1.281 | 0.043 | 0.737 | 0.164 | 0.217 | 0.737 |
| 0.699 | 0.250 | 0.737 | −1.287 | 0.050 | 0.737 | 0.231 | 0.229 | 0.737 |
| 0.651 | 0.229 | 0.737 | −1.292 | 0.056 | 0.737 | 0.296 | 0.240 | 0.737 |
| 0.601 | 0.207 | 0.737 | −1.294 | 0.061 | 0.737 | 0.358 | 0.252 | 0.737 |
| 0.549 | 0.185 | 0.737 | −1.295 | 0.066 | 0.737 | 0.418 | 0.264 | 0.737 |
| 0.494 | 0.162 | 0.737 | −1.295 | 0.069 | 0.737 | 0.476 | 0.276 | 0.737 |
| 0.437 | 0.139 | 0.737 | −1.293 | 0.073 | 0.737 | 0.531 | 0.288 | 0.737 |
| 0.377 | 0.115 | 0.737 | −1.290 | 0.076 | 0.737 | 0.584 | 0.300 | 0.737 |
| 0.315 | 0.092 | 0.737 | −1.285 | 0.079 | 0.737 | 0.635 | 0.312 | 0.737 |
| 0.251 | 0.069 | 0.737 | −1.279 | 0.081 | 0.737 | 0.683 | 0.324 | 0.737 |
| 0.184 | 0.046 | 0.737 | −1.270 | 0.083 | 0.737 | 0.727 | 0.336 | 0.737 |
| 0.117 | 0.024 | 0.737 | −1.258 | 0.085 | 0.737 | 0.766 | 0.346 | 0.737 |
| 0.049 | 0.003 | 0.737 | −1.244 | 0.086 | 0.737 | 0.801 | 0.356 | 0.737 |
| −0.019 | −0.016 | 0.737 | −1.226 | 0.087 | 0.737 | 0.834 | 0.365 | 0.737 |
| −0.087 | −0.034 | 0.737 | −1.204 | 0.087 | 0.737 | 0.862 | 0.374 | 0.737 |
| −0.156 | −0.051 | 0.737 | −1.179 | 0.087 | 0.737 | 0.884 | 0.380 | 0.737 |
| −0.225 | −0.065 | 0.737 | −1.150 | 0.086 | 0.737 | 0.901 | 0.385 | 0.737 |
| −0.295 | −0.078 | 0.737 | −1.116 | 0.086 | 0.737 | 0.914 | 0.389 | 0.737 |
| −0.365 | −0.089 | 0.737 | −1.077 | 0.085 | 0.737 | 0.924 | 0.388 | 0.737 |
| −0.436 | −0.097 | 0.737 | −1.034 | 0.085 | 0.737 | 0.929 | 0.385 | 0.737 |
| −0.507 | −0.104 | 0.737 | −0.987 | 0.085 | 0.737 | 0.931 | 0.382 | 0.737 |
| −0.578 | −0.108 | 0.737 | −0.935 | 0.087 | 0.737 | 0.932 | 0.380 | 0.737 |
| −0.647 | −0.110 | 0.737 | −0.880 | 0.089 | 0.737 | 0.933 | 0.380 | 0.737 |
| −0.713 | −0.110 | 0.737 | −0.824 | 0.092 | 0.737 | 0.933 | 0.379 | 0.737 |
| −0.777 | −0.107 | 0.737 | −0.765 | 0.096 | 0.737 | | | |
| −0.839 | −0.101 | 0.737 | −0.704 | 0.101 | 0.737 | | | |
| 0.811 | 0.539 | 1.473 | −0.958 | 0.054 | 1.473 | −0.717 | 0.252 | 1.473 |
| 0.811 | 0.538 | 1.473 | −1.013 | 0.060 | 1.473 | −0.653 | 0.261 | 1.473 |
| 0.812 | 0.536 | 1.473 | −1.065 | 0.068 | 1.473 | −0.588 | 0.270 | 1.473 |
| 0.812 | 0.533 | 1.473 | −1.112 | 0.077 | 1.473 | −0.523 | 0.279 | 1.473 |
| 0.811 | 0.527 | 1.473 | −1.155 | 0.087 | 1.473 | −0.457 | 0.289 | 1.473 |
| 0.805 | 0.519 | 1.473 | −1.192 | 0.097 | 1.473 | −0.392 | 0.299 | 1.473 |
| 0.793 | 0.513 | 1.473 | −1.225 | 0.108 | 1.473 | −0.326 | 0.309 | 1.473 |
| 0.776 | 0.505 | 1.473 | −1.254 | 0.118 | 1.473 | −0.261 | 0.319 | 1.473 |
| 0.756 | 0.494 | 1.473 | −1.277 | 0.128 | 1.473 | −0.196 | 0.329 | 1.473 |
| 0.729 | 0.481 | 1.473 | −1.297 | 0.138 | 1.473 | −0.130 | 0.340 | 1.473 |
| 0.698 | 0.466 | 1.473 | −1.313 | 0.146 | 1.473 | −0.065 | 0.351 | 1.473 |
| 0.665 | 0.450 | 1.473 | −1.326 | 0.154 | 1.473 | 0.000 | 0.362 | 1.473 |
| 0.627 | 0.432 | 1.473 | −1.335 | 0.161 | 1.473 | 0.065 | 0.373 | 1.473 |
| 0.585 | 0.413 | 1.473 | −1.342 | 0.168 | 1.473 | 0.130 | 0.386 | 1.473 |
| 0.539 | 0.392 | 1.473 | −1.347 | 0.173 | 1.473 | 0.193 | 0.398 | 1.473 |
| 0.491 | 0.371 | 1.473 | −1.350 | 0.178 | 1.473 | 0.253 | 0.410 | 1.473 |
| 0.440 | 0.349 | 1.473 | −1.351 | 0.183 | 1.473 | 0.311 | 0.423 | 1.473 |
| 0.387 | 0.326 | 1.473 | −1.351 | 0.186 | 1.473 | 0.367 | 0.435 | 1.473 |
| 0.332 | 0.303 | 1.473 | −1.350 | 0.189 | 1.473 | 0.421 | 0.448 | 1.473 |
| 0.275 | 0.280 | 1.473 | −1.347 | 0.192 | 1.473 | 0.473 | 0.460 | 1.473 |
| 0.215 | 0.256 | 1.473 | −1.342 | 0.195 | 1.473 | 0.522 | 0.473 | 1.473 |
| 0.152 | 0.233 | 1.473 | −1.336 | 0.198 | 1.473 | 0.569 | 0.485 | 1.473 |
| 0.087 | 0.210 | 1.473 | −1.327 | 0.200 | 1.473 | 0.611 | 0.496 | 1.473 |
| 0.022 | 0.188 | 1.473 | −1.316 | 0.202 | 1.473 | 0.649 | 0.507 | 1.473 |
| −0.044 | 0.167 | 1.473 | −1.302 | 0.204 | 1.473 | 0.683 | 0.517 | 1.473 |
| −0.110 | 0.147 | 1.473 | −1.284 | 0.205 | 1.473 | 0.715 | 0.526 | 1.473 |
| −0.176 | 0.129 | 1.473 | −1.264 | 0.206 | 1.473 | 0.742 | 0.535 | 1.473 |
| −0.243 | 0.112 | 1.473 | −1.240 | 0.208 | 1.473 | 0.764 | 0.541 | 1.473 |
| −0.310 | 0.097 | 1.473 | −1.211 | 0.209 | 1.473 | 0.780 | 0.546 | 1.473 |
| −0.377 | 0.084 | 1.473 | −1.178 | 0.211 | 1.473 | 0.793 | 0.550 | 1.473 |
| −0.445 | 0.073 | 1.473 | −1.140 | 0.213 | 1.473 | 0.803 | 0.548 | 1.473 |
| −0.512 | 0.063 | 1.473 | −1.099 | 0.215 | 1.473 | 0.807 | 0.545 | 1.473 |
| −0.580 | 0.056 | 1.473 | −1.052 | 0.218 | 1.473 | 0.809 | 0.542 | 1.473 |
| −0.648 | 0.050 | 1.473 | −1.002 | 0.222 | 1.473 | 0.810 | 0.541 | 1.473 |
| −0.715 | 0.047 | 1.473 | −0.949 | 0.227 | 1.473 | 0.811 | 0.540 | 1.473 |
| −0.779 | 0.045 | 1.473 | −0.894 | 0.232 | 1.473 | 0.811 | 0.540 | 1.473 |
| −0.841 | 0.046 | 1.473 | −0.837 | 0.238 | 1.473 | | | |
| −0.901 | 0.049 | 1.473 | −0.778 | 0.245 | 1.473 | | | |
| 0.756 | 0.623 | 2.210 | −0.989 | 0.154 | 2.210 | −0.752 | 0.343 | 2.210 |
| 0.756 | 0.622 | 2.210 | −1.043 | 0.160 | 2.210 | −0.690 | 0.351 | 2.210 |
| 0.756 | 0.620 | 2.210 | −1.094 | 0.168 | 2.210 | −0.625 | 0.360 | 2.210 |
| 0.757 | 0.617 | 2.210 | −1.141 | 0.177 | 2.210 | −0.560 | 0.369 | 2.210 |
| 0.756 | 0.611 | 2.210 | −1.183 | 0.186 | 2.210 | −0.496 | 0.379 | 2.210 |

TABLE 9S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.750 | 0.603 | 2.210 | −1.220 | 0.196 | 2.210 | −0.431 | 0.388 | 2.210 |
| 0.738 | 0.597 | 2.210 | −1.253 | 0.206 | 2.210 | −0.367 | 0.398 | 2.210 |
| 0.722 | 0.588 | 2.210 | −1.281 | 0.216 | 2.210 | −0.302 | 0.408 | 2.210 |
| 0.701 | 0.578 | 2.210 | −1.304 | 0.225 | 2.210 | −0.238 | 0.418 | 2.210 |
| 0.675 | 0.565 | 2.210 | −1.324 | 0.234 | 2.210 | −0.173 | 0.428 | 2.210 |
| 0.644 | 0.551 | 2.210 | −1.340 | 0.242 | 2.210 | −0.109 | 0.438 | 2.210 |
| 0.612 | 0.535 | 2.210 | −1.352 | 0.249 | 2.210 | −0.045 | 0.449 | 2.210 |
| 0.575 | 0.518 | 2.210 | −1.362 | 0.256 | 2.210 | 0.020 | 0.461 | 2.210 |
| 0.533 | 0.499 | 2.210 | −1.369 | 0.262 | 2.210 | 0.084 | 0.472 | 2.210 |
| 0.488 | 0.479 | 2.210 | −1.374 | 0.267 | 2.210 | 0.146 | 0.484 | 2.210 |
| 0.440 | 0.457 | 2.210 | −1.377 | 0.272 | 2.210 | 0.205 | 0.496 | 2.210 |
| 0.390 | 0.436 | 2.210 | −1.379 | 0.276 | 2.210 | 0.263 | 0.508 | 2.210 |
| 0.338 | 0.414 | 2.210 | −1.378 | 0.280 | 2.210 | 0.318 | 0.521 | 2.210 |
| 0.284 | 0.391 | 2.210 | −1.377 | 0.283 | 2.210 | 0.371 | 0.533 | 2.210 |
| 0.227 | 0.369 | 2.210 | −1.374 | 0.286 | 2.210 | 0.422 | 0.545 | 2.210 |
| 0.168 | 0.346 | 2.210 | −1.369 | 0.289 | 2.210 | 0.470 | 0.557 | 2.210 |
| 0.106 | 0.324 | 2.210 | −1.363 | 0.291 | 2.210 | 0.517 | 0.570 | 2.210 |
| 0.042 | 0.301 | 2.210 | −1.355 | 0.293 | 2.210 | 0.559 | 0.581 | 2.210 |
| −0.023 | 0.280 | 2.210 | −1.344 | 0.295 | 2.210 | 0.596 | 0.592 | 2.210 |
| −0.088 | 0.260 | 2.210 | −1.330 | 0.297 | 2.210 | 0.630 | 0.601 | 2.210 |
| −0.153 | 0.241 | 2.210 | −1.312 | 0.298 | 2.210 | 0.661 | 0.611 | 2.210 |
| −0.219 | 0.224 | 2.210 | −1.292 | 0.300 | 2.210 | 0.688 | 0.619 | 2.210 |
| −0.284 | 0.208 | 2.210 | −1.268 | 0.301 | 2.210 | 0.709 | 0.625 | 2.210 |
| −0.350 | 0.194 | 2.210 | −1.240 | 0.302 | 2.210 | 0.726 | 0.630 | 2.210 |
| −0.417 | 0.181 | 2.210 | −1.207 | 0.304 | 2.210 | 0.738 | 0.634 | 2.210 |
| −0.483 | 0.171 | 2.210 | −1.170 | 0.306 | 2.210 | 0.748 | 0.632 | 2.210 |
| −0.550 | 0.162 | 2.210 | −1.129 | 0.308 | 2.210 | 0.752 | 0.629 | 2.210 |
| −0.617 | 0.155 | 2.210 | −1.083 | 0.311 | 2.210 | 0.754 | 0.626 | 2.210 |
| −0.684 | 0.150 | 2.210 | −1.034 | 0.314 | 2.210 | 0.755 | 0.624 | 2.210 |
| −0.749 | 0.147 | 2.210 | −0.982 | 0.319 | 2.210 | 0.755 | 0.624 | 2.210 |
| −0.812 | 0.146 | 2.210 | −0.927 | 0.324 | 2.210 | 0.756 | 0.623 | 2.210 |
| −0.874 | 0.147 | 2.210 | −0.871 | 0.329 | 2.210 | | | |
| −0.933 | 0.150 | 2.210 | −0.813 | 0.336 | 2.210 | | | |
| 0.768 | 0.610 | 2.946 | −0.957 | 0.168 | 2.946 | −0.722 | 0.345 | 2.946 |
| 0.768 | 0.609 | 2.946 | −1.010 | 0.175 | 2.946 | −0.661 | 0.352 | 2.946 |
| 0.769 | 0.607 | 2.946 | −1.061 | 0.182 | 2.946 | −0.597 | 0.360 | 2.946 |
| 0.769 | 0.604 | 2.946 | −1.107 | 0.192 | 2.946 | −0.533 | 0.368 | 2.946 |
| 0.768 | 0.598 | 2.946 | −1.148 | 0.201 | 2.946 | −0.469 | 0.377 | 2.946 |
| 0.763 | 0.590 | 2.946 | −1.185 | 0.211 | 2.946 | −0.405 | 0.386 | 2.946 |
| 0.751 | 0.584 | 2.946 | −1.217 | 0.221 | 2.946 | −0.341 | 0.395 | 2.946 |
| 0.735 | 0.576 | 2.946 | −1.245 | 0.231 | 2.946 | −0.278 | 0.404 | 2.946 |
| 0.715 | 0.566 | 2.946 | −1.268 | 0.240 | 2.946 | −0.214 | 0.414 | 2.946 |
| 0.688 | 0.553 | 2.946 | −1.287 | 0.248 | 2.946 | −0.150 | 0.423 | 2.946 |
| 0.658 | 0.539 | 2.946 | −1.303 | 0.256 | 2.946 | −0.087 | 0.433 | 2.946 |
| 0.626 | 0.524 | 2.946 | −1.316 | 0.264 | 2.946 | −0.023 | 0.443 | 2.946 |
| 0.589 | 0.507 | 2.946 | −1.325 | 0.270 | 2.946 | 0.041 | 0.454 | 2.946 |
| 0.548 | 0.489 | 2.946 | −1.332 | 0.276 | 2.946 | 0.104 | 0.465 | 2.946 |
| 0.503 | 0.469 | 2.946 | −1.337 | 0.281 | 2.946 | 0.165 | 0.476 | 2.946 |
| 0.456 | 0.449 | 2.946 | −1.340 | 0.286 | 2.946 | 0.224 | 0.488 | 2.946 |
| 0.407 | 0.428 | 2.946 | −1.342 | 0.290 | 2.946 | 0.281 | 0.499 | 2.946 |
| 0.355 | 0.407 | 2.946 | −1.342 | 0.293 | 2.946 | 0.336 | 0.511 | 2.946 |
| 0.301 | 0.386 | 2.946 | −1.340 | 0.296 | 2.946 | 0.388 | 0.523 | 2.946 |
| 0.245 | 0.364 | 2.946 | −1.337 | 0.299 | 2.946 | 0.438 | 0.535 | 2.946 |
| 0.186 | 0.342 | 2.946 | −1.332 | 0.302 | 2.946 | 0.486 | 0.547 | 2.946 |
| 0.125 | 0.321 | 2.946 | −1.326 | 0.304 | 2.946 | 0.532 | 0.559 | 2.946 |
| 0.061 | 0.300 | 2.946 | −1.318 | 0.306 | 2.946 | 0.573 | 0.570 | 2.946 |
| −0.003 | 0.280 | 2.946 | −1.307 | 0.308 | 2.946 | 0.611 | 0.580 | 2.946 |
| −0.067 | 0.261 | 2.946 | −1.293 | 0.309 | 2.946 | 0.644 | 0.589 | 2.946 |
| −0.132 | 0.243 | 2.946 | −1.276 | 0.310 | 2.946 | 0.675 | 0.598 | 2.946 |
| −0.197 | 0.227 | 2.946 | −1.256 | 0.311 | 2.946 | 0.702 | 0.606 | 2.946 |
| −0.262 | 0.213 | 2.946 | −1.232 | 0.311 | 2.946 | 0.722 | 0.613 | 2.946 |
| −0.327 | 0.200 | 2.946 | −1.204 | 0.312 | 2.946 | 0.739 | 0.618 | 2.946 |
| −0.392 | 0.188 | 2.946 | −1.172 | 0.312 | 2.946 | 0.751 | 0.621 | 2.946 |
| −0.458 | 0.179 | 2.946 | −1.136 | 0.313 | 2.946 | 0.760 | 0.619 | 2.946 |
| −0.524 | 0.171 | 2.946 | −1.095 | 0.315 | 2.946 | 0.764 | 0.616 | 2.946 |
| −0.590 | 0.165 | 2.946 | −1.050 | 0.317 | 2.946 | 0.767 | 0.613 | 2.946 |
| −0.657 | 0.161 | 2.946 | −1.000 | 0.319 | 2.946 | 0.767 | 0.611 | 2.946 |
| −0.721 | 0.159 | 2.946 | −0.949 | 0.323 | 2.946 | 0.768 | 0.611 | 2.946 |
| −0.783 | 0.158 | 2.946 | −0.896 | 0.327 | 2.946 | 0.768 | 0.610 | 2.946 |
| −0.844 | 0.160 | 2.946 | −0.840 | 0.332 | 2.946 | | | |
| −0.902 | 0.163 | 2.946 | −0.782 | 0.338 | 2.946 | | | |
| 0.862 | 0.484 | 3.683 | −0.852 | 0.081 | 3.683 | −0.617 | 0.242 | 3.683 |
| 0.863 | 0.483 | 3.683 | −0.905 | 0.088 | 3.683 | −0.556 | 0.248 | 3.683 |
| 0.863 | 0.481 | 3.683 | −0.954 | 0.097 | 3.683 | −0.492 | 0.255 | 3.683 |
| 0.863 | 0.477 | 3.683 | −1.000 | 0.107 | 3.683 | −0.429 | 0.262 | 3.683 |
| 0.863 | 0.472 | 3.683 | −1.040 | 0.117 | 3.683 | −0.366 | 0.269 | 3.683 |
| 0.857 | 0.464 | 3.683 | −1.077 | 0.127 | 3.683 | −0.302 | 0.277 | 3.683 |

TABLE 9S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.845 | 0.458 | 3.683 | −1.108 | 0.137 | 3.683 | −0.239 | 0.285 | 3.683 |
| 0.829 | 0.450 | 3.683 | −1.135 | 0.147 | 3.683 | −0.176 | 0.293 | 3.683 |
| 0.809 | 0.441 | 3.683 | −1.158 | 0.156 | 3.683 | −0.112 | 0.301 | 3.683 |
| 0.783 | 0.428 | 3.683 | −1.177 | 0.165 | 3.683 | −0.049 | 0.310 | 3.683 |
| 0.753 | 0.415 | 3.683 | −1.193 | 0.172 | 3.683 | 0.014 | 0.319 | 3.683 |
| 0.721 | 0.400 | 3.683 | −1.206 | 0.180 | 3.683 | 0.077 | 0.328 | 3.683 |
| 0.684 | 0.384 | 3.683 | −1.215 | 0.186 | 3.683 | 0.140 | 0.338 | 3.683 |
| 0.644 | 0.367 | 3.683 | −1.222 | 0.192 | 3.683 | 0.203 | 0.348 | 3.683 |
| 0.599 | 0.348 | 3.683 | −1.227 | 0.196 | 3.683 | 0.264 | 0.358 | 3.683 |
| 0.552 | 0.329 | 3.683 | −1.230 | 0.201 | 3.683 | 0.323 | 0.368 | 3.683 |
| 0.503 | 0.309 | 3.683 | −1.232 | 0.205 | 3.683 | 0.379 | 0.379 | 3.683 |
| 0.451 | 0.289 | 3.683 | −1.232 | 0.209 | 3.683 | 0.433 | 0.390 | 3.683 |
| 0.397 | 0.269 | 3.683 | −1.230 | 0.211 | 3.683 | 0.485 | 0.401 | 3.683 |
| 0.341 | 0.249 | 3.683 | −1.227 | 0.214 | 3.683 | 0.535 | 0.412 | 3.683 |
| 0.282 | 0.229 | 3.683 | −1.222 | 0.216 | 3.683 | 0.583 | 0.423 | 3.683 |
| 0.222 | 0.209 | 3.683 | −1.216 | 0.218 | 3.683 | 0.628 | 0.435 | 3.683 |
| 0.158 | 0.189 | 3.683 | −1.208 | 0.220 | 3.683 | 0.669 | 0.445 | 3.683 |
| 0.095 | 0.171 | 3.683 | −1.197 | 0.221 | 3.683 | 0.706 | 0.455 | 3.683 |
| 0.031 | 0.153 | 3.683 | −1.183 | 0.222 | 3.683 | 0.739 | 0.465 | 3.683 |
| −0.034 | 0.137 | 3.683 | −1.166 | 0.222 | 3.683 | 0.770 | 0.473 | 3.683 |
| −0.098 | 0.123 | 3.683 | −1.146 | 0.222 | 3.683 | 0.796 | 0.481 | 3.683 |
| −0.163 | 0.110 | 3.683 | −1.123 | 0.222 | 3.683 | 0.817 | 0.487 | 3.683 |
| −0.228 | 0.099 | 3.683 | −1.095 | 0.222 | 3.683 | 0.833 | 0.492 | 3.683 |
| −0.293 | 0.089 | 3.683 | −1.063 | 0.221 | 3.683 | 0.845 | 0.495 | 3.683 |
| −0.358 | 0.081 | 3.683 | −1.027 | 0.221 | 3.683 | 0.855 | 0.493 | 3.683 |
| −0.424 | 0.075 | 3.683 | −0.987 | 0.222 | 3.683 | 0.859 | 0.489 | 3.683 |
| −0.489 | 0.070 | 3.683 | −0.942 | 0.223 | 3.683 | 0.861 | 0.487 | 3.683 |
| −0.555 | 0.068 | 3.683 | −0.893 | 0.224 | 3.683 | 0.862 | 0.485 | 3.683 |
| −0.618 | 0.067 | 3.683 | −0.842 | 0.226 | 3.683 | 0.862 | 0.484 | 3.683 |
| −0.680 | 0.068 | 3.683 | −0.789 | 0.229 | 3.683 | 0.862 | 0.484 | 3.683 |
| −0.740 | 0.071 | 3.683 | −0.734 | 0.232 | 3.683 | | | |
| −0.797 | 0.075 | 3.683 | −0.676 | 0.237 | 3.683 | | | |
| 1.018 | 0.272 | 4.419 | −0.701 | −0.071 | 4.419 | −0.462 | 0.070 | 4.419 |
| 1.018 | 0.271 | 4.419 | −0.753 | −0.062 | 4.419 | −0.400 | 0.074 | 4.419 |
| 1.019 | 0.269 | 4.419 | −0.802 | −0.052 | 4.419 | −0.337 | 0.078 | 4.419 |
| 1.019 | 0.265 | 4.419 | −0.847 | −0.041 | 4.419 | −0.274 | 0.083 | 4.419 |
| 1.018 | 0.260 | 4.419 | −0.887 | −0.029 | 4.419 | −0.210 | 0.088 | 4.419 |
| 1.013 | 0.252 | 4.419 | −0.922 | −0.018 | 4.419 | −0.147 | 0.094 | 4.419 |
| 1.001 | 0.246 | 4.419 | −0.954 | −0.007 | 4.419 | −0.084 | 0.100 | 4.419 |
| 0.985 | 0.239 | 4.419 | −0.980 | 0.004 | 4.419 | −0.020 | 0.106 | 4.419 |
| 0.965 | 0.230 | 4.419 | −1.003 | 0.013 | 4.419 | 0.043 | 0.112 | 4.419 |
| 0.939 | 0.218 | 4.419 | −1.022 | 0.022 | 4.419 | 0.106 | 0.119 | 4.419 |
| 0.908 | 0.205 | 4.419 | −1.037 | 0.030 | 4.419 | 0.169 | 0.126 | 4.419 |
| 0.876 | 0.191 | 4.419 | −1.049 | 0.038 | 4.419 | 0.232 | 0.133 | 4.419 |
| 0.839 | 0.176 | 4.419 | −1.059 | 0.044 | 4.419 | 0.295 | 0.141 | 4.419 |
| 0.798 | 0.160 | 4.419 | −1.066 | 0.050 | 4.419 | 0.359 | 0.149 | 4.419 |
| 0.753 | 0.142 | 4.419 | −1.071 | 0.055 | 4.419 | 0.419 | 0.158 | 4.419 |
| 0.706 | 0.125 | 4.419 | −1.074 | 0.059 | 4.419 | 0.478 | 0.167 | 4.419 |
| 0.656 | 0.106 | 4.419 | −1.076 | 0.063 | 4.419 | 0.535 | 0.176 | 4.419 |
| 0.604 | 0.088 | 4.419 | −1.076 | 0.067 | 4.419 | 0.589 | 0.186 | 4.419 |
| 0.550 | 0.070 | 4.419 | −1.074 | 0.069 | 4.419 | 0.641 | 0.195 | 4.419 |
| 0.494 | 0.052 | 4.419 | −1.070 | 0.072 | 4.419 | 0.691 | 0.205 | 4.419 |
| 0.435 | 0.034 | 4.419 | −1.065 | 0.073 | 4.419 | 0.738 | 0.216 | 4.419 |
| 0.373 | 0.016 | 4.419 | −1.059 | 0.075 | 4.419 | 0.784 | 0.226 | 4.419 |
| 0.310 | −0.001 | 4.419 | −1.051 | 0.075 | 4.419 | 0.825 | 0.236 | 4.419 |
| 0.246 | −0.017 | 4.419 | −1.040 | 0.076 | 4.419 | 0.862 | 0.246 | 4.419 |
| 0.181 | −0.032 | 4.419 | −1.026 | 0.076 | 4.419 | 0.895 | 0.254 | 4.419 |
| 0.117 | −0.046 | 4.419 | −1.009 | 0.075 | 4.419 | 0.926 | 0.263 | 4.419 |
| 0.052 | −0.058 | 4.419 | −0.989 | 0.074 | 4.419 | 0.952 | 0.270 | 4.419 |
| −0.013 | −0.068 | 4.419 | −0.966 | 0.072 | 4.419 | 0.973 | 0.276 | 4.419 |
| −0.079 | −0.077 | 4.419 | −0.939 | 0.071 | 4.419 | 0.989 | 0.281 | 4.419 |
| −0.144 | −0.084 | 4.419 | −0.907 | 0.069 | 4.419 | 1.001 | 0.283 | 4.419 |
| −0.209 | −0.089 | 4.419 | −0.871 | 0.067 | 4.419 | 1.010 | 0.281 | 4.419 |
| −0.275 | −0.093 | 4.419 | −0.830 | 0.065 | 4.419 | 1.014 | 0.277 | 4.419 |
| −0.340 | −0.095 | 4.419 | −0.786 | 0.064 | 4.419 | 1.016 | 0.275 | 4.419 |
| −0.406 | −0.095 | 4.419 | −0.737 | 0.063 | 4.419 | 1.017 | 0.273 | 4.419 |
| −0.469 | −0.094 | 4.419 | −0.686 | 0.063 | 4.419 | 1.018 | 0.272 | 4.419 |
| −0.530 | −0.090 | 4.419 | −0.633 | 0.064 | 4.419 | 1.018 | 0.272 | 4.419 |
| −0.589 | −0.085 | 4.419 | −0.578 | 0.065 | 4.419 | | | |
| −0.646 | −0.079 | 4.419 | −0.521 | 0.067 | 4.419 | | | |
| 1.110 | 0.152 | 4.787 | −0.615 | −0.163 | 4.787 | −0.374 | −0.032 | 4.787 |
| 1.111 | 0.151 | 4.787 | −0.667 | −0.153 | 4.787 | −0.313 | −0.030 | 4.787 |
| 1.111 | 0.149 | 4.787 | −0.717 | −0.142 | 4.787 | −0.249 | −0.027 | 4.787 |
| 1.112 | 0.146 | 4.787 | −0.761 | −0.130 | 4.787 | −0.186 | −0.023 | 4.787 |
| 1.111 | 0.140 | 4.787 | −0.802 | −0.118 | 4.787 | −0.122 | −0.019 | 4.787 |
| 1.105 | 0.132 | 4.787 | −0.837 | −0.107 | 4.787 | −0.058 | −0.014 | 4.787 |
| 1.094 | 0.126 | 4.787 | −0.868 | −0.095 | 4.787 | 0.005 | −0.010 | 4.787 |

TABLE 9S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.077 | 0.119 | 4.787 | −0.895 | −0.084 | 4.787 | 0.069 | −0.005 | 4.787 |
| 1.057 | 0.110 | 4.787 | −0.917 | −0.074 | 4.787 | 0.132 | 0.001 | 4.787 |
| 1.031 | 0.099 | 4.787 | −0.936 | −0.065 | 4.787 | 0.195 | 0.006 | 4.787 |
| 1.000 | 0.086 | 4.787 | −0.951 | −0.057 | 4.787 | 0.259 | 0.013 | 4.787 |
| 0.968 | 0.073 | 4.787 | −0.963 | −0.049 | 4.787 | 0.322 | 0.019 | 4.787 |
| 0.931 | 0.058 | 4.787 | −0.973 | −0.042 | 4.787 | 0.386 | 0.026 | 4.787 |
| 0.890 | 0.042 | 4.787 | −0.980 | −0.037 | 4.787 | 0.449 | 0.034 | 4.787 |
| 0.844 | 0.025 | 4.787 | −0.985 | −0.032 | 4.787 | 0.510 | 0.042 | 4.787 |
| 0.796 | 0.008 | 4.787 | −0.988 | −0.028 | 4.787 | 0.569 | 0.050 | 4.787 |
| 0.746 | −0.009 | 4.787 | −0.990 | −0.023 | 4.787 | 0.626 | 0.059 | 4.787 |
| 0.694 | −0.026 | 4.787 | −0.990 | −0.020 | 4.787 | 0.680 | 0.068 | 4.787 |
| 0.639 | −0.044 | 4.787 | −0.988 | −0.018 | 4.787 | 0.732 | 0.077 | 4.787 |
| 0.582 | −0.061 | 4.787 | −0.984 | −0.015 | 4.787 | 0.782 | 0.087 | 4.787 |
| 0.523 | −0.078 | 4.787 | −0.979 | −0.014 | 4.787 | 0.830 | 0.097 | 4.787 |
| 0.461 | −0.095 | 4.787 | −0.973 | −0.013 | 4.787 | 0.876 | 0.107 | 4.787 |
| 0.397 | −0.111 | 4.787 | −0.964 | −0.013 | 4.787 | 0.917 | 0.117 | 4.787 |
| 0.333 | −0.126 | 4.787 | −0.953 | −0.013 | 4.787 | 0.954 | 0.126 | 4.787 |
| 0.268 | −0.139 | 4.787 | −0.939 | −0.014 | 4.787 | 0.987 | 0.135 | 4.787 |
| 0.203 | −0.151 | 4.787 | −0.923 | −0.015 | 4.787 | 1.018 | 0.143 | 4.787 |
| 0.138 | −0.162 | 4.787 | −0.903 | −0.017 | 4.787 | 1.045 | 0.150 | 4.787 |
| 0.072 | −0.171 | 4.787 | −0.879 | −0.020 | 4.787 | 1.065 | 0.156 | 4.787 |
| 0.007 | −0.179 | 4.787 | −0.852 | −0.022 | 4.787 | 1.081 | 0.161 | 4.787 |
| −0.059 | −0.185 | 4.787 | −0.820 | −0.025 | 4.787 | 1.094 | 0.164 | 4.787 |
| −0.124 | −0.189 | 4.787 | −0.784 | −0.028 | 4.787 | 1.103 | 0.161 | 4.787 |
| −0.190 | −0.191 | 4.787 | −0.744 | −0.030 | 4.787 | 1.107 | 0.158 | 4.787 |
| −0.255 | −0.192 | 4.787 | −0.699 | −0.032 | 4.787 | 1.109 | 0.155 | 4.787 |
| −0.321 | −0.191 | 4.787 | −0.650 | −0.034 | 4.787 | 1.110 | 0.153 | 4.787 |
| −0.384 | −0.188 | 4.787 | −0.600 | −0.035 | 4.787 | 1.110 | 0.153 | 4.787 |
| −0.445 | −0.184 | 4.787 | −0.546 | −0.035 | 4.787 | 1.110 | 0.152 | 4.787 |
| −0.504 | −0.178 | 4.787 | −0.491 | −0.035 | 4.787 | | | |
| −0.560 | −0.171 | 4.787 | −0.434 | −0.034 | 4.787 | | | |
| 1.156 | 0.090 | 4.972 | −0.575 | −0.205 | 4.972 | −0.332 | −0.083 | 4.972 |
| 1.156 | 0.090 | 4.972 | −0.627 | −0.195 | 4.972 | −0.271 | −0.081 | 4.972 |
| 1.157 | 0.088 | 4.972 | −0.676 | −0.183 | 4.972 | −0.207 | −0.079 | 4.972 |
| 1.157 | 0.084 | 4.972 | −0.721 | −0.171 | 4.972 | −0.143 | −0.076 | 4.972 |
| 1.156 | 0.079 | 4.972 | −0.761 | −0.158 | 4.972 | −0.079 | −0.073 | 4.972 |
| 1.150 | 0.071 | 4.972 | −0.797 | −0.146 | 4.972 | −0.016 | −0.069 | 4.972 |
| 1.139 | 0.065 | 4.972 | −0.827 | −0.134 | 4.972 | 0.048 | −0.065 | 4.972 |
| 1.123 | 0.058 | 4.972 | −0.854 | −0.123 | 4.972 | 0.112 | −0.061 | 4.972 |
| 1.102 | 0.049 | 4.972 | −0.876 | −0.112 | 4.972 | 0.175 | −0.056 | 4.972 |
| 1.076 | 0.037 | 4.972 | −0.895 | −0.103 | 4.972 | 0.239 | −0.051 | 4.972 |
| 1.045 | 0.025 | 4.972 | −0.910 | −0.094 | 4.972 | 0.302 | −0.046 | 4.972 |
| 1.013 | 0.011 | 4.972 | −0.922 | −0.087 | 4.972 | 0.366 | −0.040 | 4.972 |
| 0.976 | −0.003 | 4.972 | −0.932 | −0.080 | 4.972 | 0.429 | −0.033 | 4.972 |
| 0.934 | −0.019 | 4.972 | −0.938 | −0.074 | 4.972 | 0.493 | −0.026 | 4.972 |
| 0.889 | −0.035 | 4.972 | −0.943 | −0.069 | 4.972 | 0.554 | −0.018 | 4.972 |
| 0.841 | −0.052 | 4.972 | −0.947 | −0.065 | 4.972 | 0.613 | −0.010 | 4.972 |
| 0.790 | −0.069 | 4.972 | −0.948 | −0.061 | 4.972 | 0.670 | −0.002 | 4.972 |
| 0.738 | −0.086 | 4.972 | −0.948 | −0.057 | 4.972 | 0.725 | 0.007 | 4.972 |
| 0.683 | −0.103 | 4.972 | −0.946 | −0.055 | 4.972 | 0.777 | 0.016 | 4.972 |
| 0.626 | −0.119 | 4.972 | −0.942 | −0.053 | 4.972 | 0.827 | 0.026 | 4.972 |
| 0.566 | −0.136 | 4.972 | −0.937 | −0.052 | 4.972 | 0.875 | 0.035 | 4.972 |
| 0.504 | −0.152 | 4.972 | −0.931 | −0.051 | 4.972 | 0.921 | 0.045 | 4.972 |
| 0.440 | −0.167 | 4.972 | −0.922 | −0.051 | 4.972 | 0.962 | 0.055 | 4.972 |
| 0.375 | −0.181 | 4.972 | −0.911 | −0.052 | 4.972 | 0.999 | 0.065 | 4.972 |
| 0.310 | −0.194 | 4.972 | −0.898 | −0.053 | 4.972 | 1.032 | 0.073 | 4.972 |
| 0.245 | −0.205 | 4.972 | −0.881 | −0.055 | 4.972 | 1.063 | 0.081 | 4.972 |
| 0.179 | −0.215 | 4.972 | −0.861 | −0.058 | 4.972 | 1.090 | 0.089 | 4.972 |
| 0.114 | −0.223 | 4.972 | −0.838 | −0.061 | 4.972 | 1.110 | 0.095 | 4.972 |
| 0.048 | −0.230 | 4.972 | −0.810 | −0.064 | 4.972 | 1.127 | 0.100 | 4.972 |
| −0.018 | −0.235 | 4.972 | −0.779 | −0.068 | 4.972 | 1.139 | 0.102 | 4.972 |
| −0.084 | −0.238 | 4.972 | −0.743 | −0.071 | 4.972 | 1.148 | 0.100 | 4.972 |
| −0.150 | −0.240 | 4.972 | −0.702 | −0.075 | 4.972 | 1.152 | 0.096 | 4.972 |
| −0.215 | −0.240 | 4.972 | −0.658 | −0.078 | 4.972 | 1.154 | 0.094 | 4.972 |
| −0.281 | −0.238 | 4.972 | −0.609 | −0.080 | 4.972 | 1.155 | 0.092 | 4.972 |
| −0.344 | −0.234 | 4.972 | −0.558 | −0.082 | 4.972 | 1.156 | 0.091 | 4.972 |
| −0.405 | −0.229 | 4.972 | −0.505 | −0.083 | 4.972 | 1.156 | 0.091 | 4.972 |
| −0.464 | −0.222 | 4.972 | −0.449 | −0.084 | 4.972 | | | |
| −0.520 | −0.215 | 4.972 | −0.392 | −0.084 | 4.972 | | | |
| 1.297 | −0.109 | 5.524 | −0.450 | −0.329 | 5.524 | −0.201 | −0.250 | 5.524 |
| 1.297 | −0.110 | 5.524 | −0.501 | −0.313 | 5.524 | −0.139 | −0.254 | 5.524 |
| 1.298 | −0.112 | 5.524 | −0.550 | −0.296 | 5.524 | −0.075 | −0.257 | 5.524 |
| 1.298 | −0.115 | 5.524 | −0.594 | −0.279 | 5.524 | −0.011 | −0.258 | 5.524 |
| 1.297 | −0.121 | 5.524 | −0.633 | −0.262 | 5.524 | 0.053 | −0.259 | 5.524 |
| 1.292 | −0.129 | 5.524 | −0.668 | −0.246 | 5.524 | 0.118 | −0.259 | 5.524 |
| 1.280 | −0.136 | 5.524 | −0.698 | −0.231 | 5.524 | 0.182 | −0.259 | 5.524 |
| 1.264 | −0.143 | 5.524 | −0.723 | −0.216 | 5.524 | 0.246 | −0.257 | 5.524 |

TABLE 9S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.244 | −0.153 | 5.524 | −0.745 | −0.204 | 5.524 | 0.310 | −0.255 | 5.524 |
| 1.217 | −0.164 | 5.524 | −0.763 | −0.193 | 5.524 | 0.374 | −0.252 | 5.524 |
| 1.186 | −0.178 | 5.524 | −0.777 | −0.182 | 5.524 | 0.438 | −0.249 | 5.524 |
| 1.153 | −0.192 | 5.524 | −0.789 | −0.174 | 5.524 | 0.502 | −0.244 | 5.524 |
| 1.116 | −0.207 | 5.524 | −0.798 | −0.166 | 5.524 | 0.566 | −0.239 | 5.524 |
| 1.074 | −0.223 | 5.524 | −0.804 | −0.159 | 5.524 | 0.630 | −0.233 | 5.524 |
| 1.028 | −0.240 | 5.524 | −0.809 | −0.154 | 5.524 | 0.692 | −0.226 | 5.524 |
| 0.980 | −0.257 | 5.524 | −0.812 | −0.149 | 5.524 | 0.752 | −0.219 | 5.524 |
| 0.929 | −0.274 | 5.524 | −0.813 | −0.145 | 5.524 | 0.809 | −0.210 | 5.524 |
| 0.875 | −0.291 | 5.524 | −0.813 | −0.142 | 5.524 | 0.864 | −0.201 | 5.524 |
| 0.820 | −0.308 | 5.524 | −0.810 | −0.140 | 5.524 | 0.917 | −0.192 | 5.524 |
| 0.762 | −0.323 | 5.524 | −0.806 | −0.138 | 5.524 | 0.967 | −0.182 | 5.524 |
| 0.701 | −0.338 | 5.524 | −0.801 | −0.138 | 5.524 | 1.015 | −0.171 | 5.524 |
| 0.639 | −0.352 | 5.524 | −0.795 | −0.139 | 5.524 | 1.061 | −0.160 | 5.524 |
| 0.573 | −0.365 | 5.524 | −0.786 | −0.140 | 5.524 | 1.103 | −0.150 | 5.524 |
| 0.508 | −0.377 | 5.524 | −0.775 | −0.142 | 5.524 | 1.140 | −0.139 | 5.524 |
| 0.442 | −0.386 | 5.524 | −0.762 | −0.146 | 5.524 | 1.173 | −0.130 | 5.524 |
| 0.377 | −0.394 | 5.524 | −0.745 | −0.150 | 5.524 | 1.204 | −0.121 | 5.524 |
| 0.310 | −0.400 | 5.524 | −0.726 | −0.156 | 5.524 | 1.231 | −0.113 | 5.524 |
| 0.244 | −0.404 | 5.524 | −0.703 | −0.163 | 5.524 | 1.251 | −0.106 | 5.524 |
| 0.177 | −0.407 | 5.524 | −0.677 | −0.171 | 5.524 | 1.268 | −0.101 | 5.524 |
| 0.111 | −0.407 | 5.524 | −0.646 | −0.179 | 5.524 | 1.280 | −0.098 | 5.524 |
| 0.043 | −0.406 | 5.524 | −0.610 | −0.189 | 5.524 | 1.289 | −0.100 | 5.524 |
| −0.024 | −0.402 | 5.524 | −0.571 | −0.198 | 5.524 | 1.293 | −0.103 | 5.524 |
| −0.090 | −0.397 | 5.524 | −0.526 | −0.207 | 5.524 | 1.295 | −0.106 | 5.524 |
| −0.157 | −0.389 | 5.524 | −0.478 | −0.217 | 5.524 | 1.296 | −0.108 | 5.524 |
| −0.220 | −0.380 | 5.524 | −0.427 | −0.225 | 5.524 | 1.297 | −0.108 | 5.524 |
| −0.282 | −0.370 | 5.524 | −0.374 | −0.233 | 5.524 | 1.297 | −0.109 | 5.524 |
| −0.340 | −0.358 | 5.524 | −0.319 | −0.239 | 5.524 | | | |
| −0.396 | −0.344 | 5.524 | −0.261 | −0.245 | 5.524 | | | |
| 1.389 | −0.249 | 5.892 | −0.391 | −0.370 | 5.892 | −0.137 | −0.335 | 5.892 |
| 1.389 | −0.250 | 5.892 | −0.440 | −0.347 | 5.892 | −0.075 | −0.345 | 5.892 |
| 1.390 | −0.251 | 5.892 | −0.487 | −0.324 | 5.892 | −0.011 | −0.355 | 5.892 |
| 1.390 | −0.255 | 5.892 | −0.530 | −0.301 | 5.892 | 0.054 | −0.362 | 5.892 |
| 1.389 | −0.261 | 5.892 | −0.567 | −0.279 | 5.892 | 0.118 | −0.368 | 5.892 |
| 1.383 | −0.269 | 5.892 | −0.600 | −0.258 | 5.892 | 0.184 | −0.373 | 5.892 |
| 1.371 | −0.275 | 5.892 | −0.629 | −0.240 | 5.892 | 0.249 | −0.376 | 5.892 |
| 1.355 | −0.283 | 5.892 | −0.653 | −0.223 | 5.892 | 0.315 | −0.378 | 5.892 |
| 1.334 | −0.293 | 5.892 | −0.674 | −0.208 | 5.892 | 0.380 | −0.379 | 5.892 |
| 1.307 | −0.304 | 5.892 | −0.691 | −0.195 | 5.892 | 0.446 | −0.378 | 5.892 |
| 1.275 | −0.318 | 5.892 | −0.705 | −0.184 | 5.892 | 0.511 | −0.377 | 5.892 |
| 1.241 | −0.332 | 5.892 | −0.716 | −0.174 | 5.892 | 0.577 | −0.374 | 5.892 |
| 1.203 | −0.346 | 5.892 | −0.724 | −0.165 | 5.892 | 0.642 | −0.371 | 5.892 |
| 1.160 | −0.362 | 5.892 | −0.730 | −0.158 | 5.892 | 0.708 | −0.366 | 5.892 |
| 1.113 | −0.379 | 5.892 | −0.734 | −0.153 | 5.892 | 0.771 | −0.361 | 5.892 |
| 1.063 | −0.396 | 5.892 | −0.737 | −0.148 | 5.892 | 0.832 | −0.355 | 5.892 |
| 1.011 | −0.412 | 5.892 | −0.738 | −0.143 | 5.892 | 0.890 | −0.347 | 5.892 |
| 0.956 | −0.428 | 5.892 | −0.738 | −0.140 | 5.892 | 0.947 | −0.339 | 5.892 |
| 0.899 | −0.444 | 5.892 | −0.735 | −0.138 | 5.892 | 1.001 | −0.330 | 5.892 |
| 0.839 | −0.458 | 5.892 | −0.731 | −0.137 | 5.892 | 1.052 | −0.321 | 5.892 |
| 0.776 | −0.471 | 5.892 | −0.725 | −0.138 | 5.892 | 1.101 | −0.310 | 5.892 |
| 0.711 | −0.483 | 5.892 | −0.719 | −0.139 | 5.892 | 1.148 | −0.300 | 5.892 |
| 0.644 | −0.494 | 5.892 | −0.710 | −0.141 | 5.892 | 1.191 | −0.289 | 5.892 |
| 0.576 | −0.502 | 5.892 | −0.699 | −0.145 | 5.892 | 1.229 | −0.279 | 5.892 |
| 0.508 | −0.509 | 5.892 | −0.686 | −0.150 | 5.892 | 1.263 | −0.270 | 5.892 |
| 0.440 | −0.513 | 5.892 | −0.670 | −0.157 | 5.892 | 1.294 | −0.260 | 5.892 |
| 0.372 | −0.516 | 5.892 | −0.651 | −0.165 | 5.892 | 1.321 | −0.252 | 5.892 |
| 0.304 | −0.516 | 5.892 | −0.629 | −0.175 | 5.892 | 1.342 | −0.246 | 5.892 |
| 0.236 | −0.513 | 5.892 | −0.603 | −0.187 | 5.892 | 1.359 | −0.240 | 5.892 |
| 0.168 | −0.508 | 5.892 | −0.573 | −0.201 | 5.892 | 1.372 | −0.237 | 5.892 |
| 0.101 | −0.501 | 5.892 | −0.538 | −0.216 | 5.892 | 1.381 | −0.239 | 5.892 |
| 0.033 | −0.491 | 5.892 | −0.499 | −0.232 | 5.892 | 1.385 | −0.243 | 5.892 |
| −0.034 | −0.479 | 5.892 | −0.456 | −0.248 | 5.892 | 1.387 | −0.245 | 5.892 |
| −0.101 | −0.465 | 5.892 | −0.409 | −0.265 | 5.892 | 1.388 | −0.247 | 5.892 |
| −0.165 | −0.449 | 5.892 | −0.359 | −0.281 | 5.892 | 1.389 | −0.248 | 5.892 |
| −0.225 | −0.431 | 5.892 | −0.307 | −0.296 | 5.892 | 1.389 | −0.248 | 5.892 |
| −0.283 | −0.412 | 5.892 | −0.253 | −0.310 | 5.892 | | | |
| −0.338 | −0.391 | 5.892 | −0.196 | −0.323 | 5.892 | | | |

The coordinate values given in TABLE 10S below provide the nominal profile envelope for an exemplary tenth stage stator.

TABLE 10S

| X-LOC | Y-LOC | Z-LOC | X-LOC | Y-LOC | Z-LOC | X-LOC | Y-LOC | Z-LOC |
|---|---|---|---|---|---|---|---|---|
| 0.930 | 0.143 | 0.000 | −1.156 | −0.094 | 0.000 | −0.834 | 0.064 | 0.000 |
| 0.931 | 0.142 | 0.000 | −1.215 | −0.068 | 0.000 | −0.761 | 0.059 | 0.000 |
| 0.931 | 0.140 | 0.000 | −1.270 | −0.041 | 0.000 | −0.686 | 0.055 | 0.000 |
| 0.931 | 0.136 | 0.000 | −1.319 | −0.015 | 0.000 | −0.611 | 0.053 | 0.000 |
| 0.928 | 0.130 | 0.000 | −1.362 | 0.011 | 0.000 | −0.536 | 0.052 | 0.000 |
| 0.917 | 0.123 | 0.000 | −1.400 | 0.036 | 0.000 | −0.461 | 0.051 | 0.000 |
| 0.903 | 0.117 | 0.000 | −1.433 | 0.060 | 0.000 | −0.386 | 0.052 | 0.000 |
| 0.883 | 0.109 | 0.000 | −1.461 | 0.081 | 0.000 | −0.311 | 0.053 | 0.000 |
| 0.859 | 0.098 | 0.000 | −1.483 | 0.101 | 0.000 | −0.236 | 0.054 | 0.000 |
| 0.827 | 0.085 | 0.000 | −1.502 | 0.118 | 0.000 | −0.161 | 0.056 | 0.000 |
| 0.790 | 0.070 | 0.000 | −1.517 | 0.133 | 0.000 | −0.086 | 0.058 | 0.000 |
| 0.750 | 0.054 | 0.000 | −1.529 | 0.146 | 0.000 | −0.011 | 0.060 | 0.000 |
| 0.705 | 0.037 | 0.000 | −1.538 | 0.156 | 0.000 | 0.064 | 0.063 | 0.000 |
| 0.655 | 0.018 | 0.000 | −1.544 | 0.165 | 0.000 | 0.139 | 0.066 | 0.000 |
| 0.600 | −0.001 | 0.000 | −1.547 | 0.173 | 0.000 | 0.211 | 0.070 | 0.000 |
| 0.542 | −0.022 | 0.000 | −1.549 | 0.179 | 0.000 | 0.281 | 0.074 | 0.000 |
| 0.482 | −0.042 | 0.000 | −1.549 | 0.185 | 0.000 | 0.349 | 0.079 | 0.000 |
| 0.418 | −0.063 | 0.000 | −1.548 | 0.189 | 0.000 | 0.414 | 0.084 | 0.000 |
| 0.352 | −0.084 | 0.000 | −1.546 | 0.191 | 0.000 | 0.476 | 0.090 | 0.000 |
| 0.283 | −0.104 | 0.000 | −1.541 | 0.194 | 0.000 | 0.536 | 0.096 | 0.000 |
| 0.211 | −0.124 | 0.000 | −1.535 | 0.195 | 0.000 | 0.593 | 0.103 | 0.000 |
| 0.137 | −0.143 | 0.000 | −1.528 | 0.196 | 0.000 | 0.648 | 0.110 | 0.000 |
| 0.059 | −0.161 | 0.000 | −1.518 | 0.195 | 0.000 | 0.697 | 0.117 | 0.000 |
| −0.019 | −0.177 | 0.000 | −1.505 | 0.194 | 0.000 | 0.742 | 0.124 | 0.000 |
| −0.097 | −0.191 | 0.000 | −1.489 | 0.190 | 0.000 | 0.782 | 0.130 | 0.000 |
| −0.175 | −0.203 | 0.000 | −1.469 | 0.186 | 0.000 | 0.819 | 0.136 | 0.000 |
| −0.254 | −0.212 | 0.000 | −1.446 | 0.180 | 0.000 | 0.851 | 0.142 | 0.000 |
| −0.333 | −0.219 | 0.000 | −1.420 | 0.173 | 0.000 | 0.875 | 0.147 | 0.000 |
| −0.412 | −0.222 | 0.000 | −1.388 | 0.164 | 0.000 | 0.895 | 0.151 | 0.000 |
| −0.492 | −0.222 | 0.000 | −1.352 | 0.154 | 0.000 | 0.910 | 0.153 | 0.000 |
| −0.573 | −0.220 | 0.000 | −1.311 | 0.143 | 0.000 | 0.921 | 0.153 | 0.000 |
| −0.653 | −0.214 | 0.000 | −1.264 | 0.131 | 0.000 | 0.926 | 0.150 | 0.000 |
| −0.732 | −0.205 | 0.000 | −1.213 | 0.119 | 0.000 | 0.929 | 0.147 | 0.000 |
| −0.811 | −0.193 | 0.000 | −1.156 | 0.107 | 0.000 | 0.930 | 0.145 | 0.000 |
| −0.886 | −0.178 | 0.000 | −1.097 | 0.096 | 0.000 | 0.930 | 0.144 | 0.000 |
| −0.958 | −0.160 | 0.000 | −1.035 | 0.086 | 0.000 | 0.930 | 0.144 | 0.000 |
| −1.027 | −0.140 | 0.000 | −0.971 | 0.078 | 0.000 | | | |
| −1.093 | −0.118 | 0.000 | −0.904 | 0.070 | 0.000 | | | |
| 0.751 | 0.372 | 0.727 | −1.069 | −0.065 | 0.727 | −0.817 | 0.136 | 0.727 |
| 0.751 | 0.371 | 0.727 | −1.124 | −0.055 | 0.727 | −0.752 | 0.142 | 0.727 |
| 0.752 | 0.369 | 0.727 | −1.177 | −0.043 | 0.727 | −0.685 | 0.148 | 0.727 |
| 0.752 | 0.365 | 0.727 | −1.225 | −0.031 | 0.727 | −0.618 | 0.155 | 0.727 |
| 0.750 | 0.360 | 0.727 | −1.268 | −0.019 | 0.727 | −0.551 | 0.163 | 0.727 |
| 0.743 | 0.353 | 0.727 | −1.306 | −0.006 | 0.727 | −0.484 | 0.171 | 0.727 |
| 0.730 | 0.346 | 0.727 | −1.340 | 0.006 | 0.727 | −0.417 | 0.180 | 0.727 |
| 0.713 | 0.338 | 0.727 | −1.368 | 0.018 | 0.727 | −0.350 | 0.188 | 0.727 |
| 0.692 | 0.328 | 0.727 | −1.392 | 0.029 | 0.727 | −0.283 | 0.197 | 0.727 |
| 0.664 | 0.315 | 0.727 | −1.411 | 0.039 | 0.727 | −0.216 | 0.205 | 0.727 |
| 0.632 | 0.300 | 0.727 | −1.427 | 0.049 | 0.727 | −0.149 | 0.214 | 0.727 |
| 0.598 | 0.284 | 0.727 | −1.440 | 0.057 | 0.727 | −0.083 | 0.223 | 0.727 |
| 0.559 | 0.267 | 0.727 | −1.450 | 0.065 | 0.727 | −0.016 | 0.233 | 0.727 |
| 0.516 | 0.247 | 0.727 | −1.456 | 0.072 | 0.727 | 0.051 | 0.243 | 0.727 |
| 0.469 | 0.226 | 0.727 | −1.460 | 0.078 | 0.727 | 0.115 | 0.253 | 0.727 |
| 0.419 | 0.205 | 0.727 | −1.463 | 0.084 | 0.727 | 0.177 | 0.263 | 0.727 |
| 0.367 | 0.182 | 0.727 | −1.463 | 0.089 | 0.727 | 0.237 | 0.273 | 0.727 |
| 0.313 | 0.159 | 0.727 | −1.463 | 0.092 | 0.727 | 0.294 | 0.284 | 0.727 |
| 0.256 | 0.136 | 0.727 | −1.462 | 0.095 | 0.727 | 0.350 | 0.294 | 0.727 |
| 0.197 | 0.113 | 0.727 | −1.459 | 0.099 | 0.727 | 0.403 | 0.305 | 0.727 |
| 0.136 | 0.089 | 0.727 | −1.455 | 0.103 | 0.727 | 0.453 | 0.316 | 0.727 |
| 0.071 | 0.066 | 0.727 | −1.449 | 0.106 | 0.727 | 0.501 | 0.326 | 0.727 |
| 0.004 | 0.043 | 0.727 | −1.441 | 0.109 | 0.727 | 0.545 | 0.336 | 0.727 |
| −0.063 | 0.022 | 0.727 | −1.429 | 0.112 | 0.727 | 0.585 | 0.346 | 0.727 |
| −0.131 | 0.001 | 0.727 | −1.415 | 0.114 | 0.727 | 0.620 | 0.354 | 0.727 |
| −0.199 | −0.017 | 0.727 | −1.397 | 0.116 | 0.727 | 0.652 | 0.362 | 0.727 |
| −0.267 | −0.034 | 0.727 | −1.376 | 0.117 | 0.727 | 0.681 | 0.369 | 0.727 |
| −0.335 | −0.048 | 0.727 | −1.351 | 0.118 | 0.727 | 0.703 | 0.374 | 0.727 |
| −0.404 | −0.060 | 0.727 | −1.322 | 0.118 | 0.727 | 0.720 | 0.379 | 0.727 |
| −0.474 | −0.070 | 0.727 | −1.288 | 0.119 | 0.727 | 0.733 | 0.382 | 0.727 |
| −0.543 | −0.078 | 0.727 | −1.250 | 0.119 | 0.727 | 0.743 | 0.381 | 0.727 |
| −0.613 | −0.084 | 0.727 | −1.207 | 0.120 | 0.727 | 0.747 | 0.378 | 0.727 |
| −0.683 | −0.087 | 0.727 | −1.160 | 0.120 | 0.727 | 0.750 | 0.375 | 0.727 |
| −0.753 | −0.089 | 0.727 | −1.109 | 0.122 | 0.727 | 0.751 | 0.373 | 0.727 |

TABLE 10S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.821 | −0.088 | 0.727 | −1.055 | 0.123 | 0.727 | 0.751 | 0.373 | 0.727 |
| −0.887 | −0.085 | 0.727 | −0.998 | 0.125 | 0.727 | 0.751 | 0.372 | 0.727 |
| −0.951 | −0.080 | 0.727 | −0.940 | 0.128 | 0.727 | | | |
| −1.011 | −0.073 | 0.727 | −0.879 | 0.132 | 0.727 | | | |
| 0.640 | 0.551 | 1.454 | −1.095 | 0.105 | 1.454 | −0.858 | 0.285 | 1.454 |
| 0.641 | 0.550 | 1.454 | −1.148 | 0.113 | 1.454 | −0.796 | 0.291 | 1.454 |
| 0.641 | 0.549 | 1.454 | −1.199 | 0.122 | 1.454 | −0.732 | 0.299 | 1.454 |
| 0.641 | 0.545 | 1.454 | −1.245 | 0.131 | 1.454 | −0.667 | 0.306 | 1.454 |
| 0.640 | 0.539 | 1.454 | −1.287 | 0.142 | 1.454 | −0.603 | 0.315 | 1.454 |
| 0.633 | 0.532 | 1.454 | −1.324 | 0.152 | 1.454 | −0.539 | 0.324 | 1.454 |
| 0.621 | 0.526 | 1.454 | −1.356 | 0.162 | 1.454 | −0.475 | 0.334 | 1.454 |
| 0.605 | 0.518 | 1.454 | −1.384 | 0.172 | 1.454 | −0.411 | 0.344 | 1.454 |
| 0.584 | 0.508 | 1.454 | −1.407 | 0.181 | 1.454 | −0.347 | 0.354 | 1.454 |
| 0.558 | 0.496 | 1.454 | −1.426 | 0.189 | 1.454 | −0.283 | 0.365 | 1.454 |
| 0.527 | 0.481 | 1.454 | −1.443 | 0.197 | 1.454 | −0.219 | 0.375 | 1.454 |
| 0.495 | 0.466 | 1.454 | −1.455 | 0.205 | 1.454 | −0.156 | 0.386 | 1.454 |
| 0.458 | 0.449 | 1.454 | −1.465 | 0.212 | 1.454 | −0.092 | 0.398 | 1.454 |
| 0.417 | 0.430 | 1.454 | −1.471 | 0.218 | 1.454 | −0.028 | 0.409 | 1.454 |
| 0.372 | 0.409 | 1.454 | −1.475 | 0.224 | 1.454 | 0.033 | 0.421 | 1.454 |
| 0.324 | 0.388 | 1.454 | −1.477 | 0.229 | 1.454 | 0.092 | 0.433 | 1.454 |
| 0.275 | 0.366 | 1.454 | −1.478 | 0.234 | 1.454 | 0.150 | 0.445 | 1.454 |
| 0.223 | 0.344 | 1.454 | −1.478 | 0.237 | 1.454 | 0.204 | 0.457 | 1.454 |
| 0.169 | 0.321 | 1.454 | −1.477 | 0.240 | 1.454 | 0.257 | 0.469 | 1.454 |
| 0.113 | 0.297 | 1.454 | −1.474 | 0.244 | 1.454 | 0.308 | 0.480 | 1.454 |
| 0.055 | 0.274 | 1.454 | −1.470 | 0.248 | 1.454 | 0.356 | 0.492 | 1.454 |
| −0.007 | 0.251 | 1.454 | −1.465 | 0.251 | 1.454 | 0.402 | 0.503 | 1.454 |
| −0.070 | 0.228 | 1.454 | −1.457 | 0.254 | 1.454 | 0.444 | 0.514 | 1.454 |
| −0.134 | 0.206 | 1.454 | −1.446 | 0.257 | 1.454 | 0.481 | 0.524 | 1.454 |
| −0.199 | 0.185 | 1.454 | −1.432 | 0.259 | 1.454 | 0.515 | 0.533 | 1.454 |
| −0.263 | 0.167 | 1.454 | −1.415 | 0.261 | 1.454 | 0.546 | 0.541 | 1.454 |
| −0.328 | 0.150 | 1.454 | −1.395 | 0.262 | 1.454 | 0.573 | 0.548 | 1.454 |
| −0.394 | 0.135 | 1.454 | −1.371 | 0.263 | 1.454 | 0.594 | 0.554 | 1.454 |
| −0.459 | 0.122 | 1.454 | −1.343 | 0.264 | 1.454 | 0.611 | 0.559 | 1.454 |
| −0.525 | 0.111 | 1.454 | −1.311 | 0.264 | 1.454 | 0.623 | 0.562 | 1.454 |
| −0.592 | 0.103 | 1.454 | −1.274 | 0.265 | 1.454 | 0.632 | 0.560 | 1.454 |
| −0.658 | 0.096 | 1.454 | −1.233 | 0.266 | 1.454 | 0.637 | 0.557 | 1.454 |
| −0.725 | 0.092 | 1.454 | −1.188 | 0.267 | 1.454 | 0.639 | 0.554 | 1.454 |
| −0.792 | 0.089 | 1.454 | −1.138 | 0.268 | 1.454 | 0.640 | 0.553 | 1.454 |
| −0.857 | 0.089 | 1.454 | −1.086 | 0.270 | 1.454 | 0.640 | 0.552 | 1.454 |
| −0.921 | 0.090 | 1.454 | −1.033 | 0.273 | 1.454 | 0.640 | 0.552 | 1.454 |
| −0.981 | 0.093 | 1.454 | −0.977 | 0.276 | 1.454 | | | |
| −1.039 | 0.098 | 1.454 | −0.918 | 0.280 | 1.454 | | | |
| 0.624 | 0.597 | 2.181 | −1.073 | 0.184 | 2.181 | −0.841 | 0.345 | 2.181 |
| 0.625 | 0.596 | 2.181 | −1.125 | 0.191 | 2.181 | −0.780 | 0.350 | 2.181 |
| 0.625 | 0.594 | 2.181 | −1.175 | 0.200 | 2.181 | −0.717 | 0.356 | 2.181 |
| 0.625 | 0.591 | 2.181 | −1.220 | 0.209 | 2.181 | −0.654 | 0.363 | 2.181 |
| 0.624 | 0.585 | 2.181 | −1.260 | 0.219 | 2.181 | −0.592 | 0.371 | 2.181 |
| 0.618 | 0.578 | 2.181 | −1.296 | 0.229 | 2.181 | −0.529 | 0.379 | 2.181 |
| 0.606 | 0.572 | 2.181 | −1.328 | 0.238 | 2.181 | −0.466 | 0.388 | 2.181 |
| 0.590 | 0.564 | 2.181 | −1.355 | 0.247 | 2.181 | −0.404 | 0.397 | 2.181 |
| 0.570 | 0.555 | 2.181 | −1.378 | 0.256 | 2.181 | −0.341 | 0.407 | 2.181 |
| 0.544 | 0.543 | 2.181 | −1.397 | 0.264 | 2.181 | −0.278 | 0.416 | 2.181 |
| 0.514 | 0.529 | 2.181 | −1.413 | 0.271 | 2.181 | −0.216 | 0.426 | 2.181 |
| 0.482 | 0.515 | 2.181 | −1.425 | 0.278 | 2.181 | −0.154 | 0.437 | 2.181 |
| 0.446 | 0.498 | 2.181 | −1.434 | 0.285 | 2.181 | −0.091 | 0.448 | 2.181 |
| 0.406 | 0.481 | 2.181 | −1.441 | 0.291 | 2.181 | −0.029 | 0.459 | 2.181 |
| 0.362 | 0.461 | 2.181 | −1.445 | 0.297 | 2.181 | 0.031 | 0.471 | 2.181 |
| 0.315 | 0.441 | 2.181 | −1.447 | 0.302 | 2.181 | 0.089 | 0.482 | 2.181 |
| 0.267 | 0.420 | 2.181 | −1.448 | 0.306 | 2.181 | 0.145 | 0.494 | 2.181 |
| 0.216 | 0.399 | 2.181 | −1.448 | 0.310 | 2.181 | 0.199 | 0.505 | 2.181 |
| 0.163 | 0.377 | 2.181 | −1.446 | 0.313 | 2.181 | 0.250 | 0.517 | 2.181 |
| 0.108 | 0.356 | 2.181 | −1.444 | 0.316 | 2.181 | 0.299 | 0.528 | 2.181 |
| 0.050 | 0.334 | 2.181 | −1.440 | 0.320 | 2.181 | 0.347 | 0.539 | 2.181 |
| −0.010 | 0.312 | 2.181 | −1.435 | 0.323 | 2.181 | 0.392 | 0.551 | 2.181 |
| −0.072 | 0.291 | 2.181 | −1.427 | 0.326 | 2.181 | 0.432 | 0.561 | 2.181 |
| −0.135 | 0.271 | 2.181 | −1.416 | 0.328 | 2.181 | 0.469 | 0.571 | 2.181 |
| −0.198 | 0.252 | 2.181 | −1.403 | 0.330 | 2.181 | 0.502 | 0.579 | 2.181 |
| −0.262 | 0.235 | 2.181 | −1.386 | 0.331 | 2.181 | 0.532 | 0.588 | 2.181 |
| −0.325 | 0.220 | 2.181 | −1.366 | 0.331 | 2.181 | 0.559 | 0.595 | 2.181 |
| −0.389 | 0.207 | 2.181 | −1.343 | 0.331 | 2.181 | 0.579 | 0.601 | 2.181 |
| −0.453 | 0.195 | 2.181 | −1.315 | 0.331 | 2.181 | 0.595 | 0.605 | 2.181 |
| −0.518 | 0.186 | 2.181 | −1.284 | 0.331 | 2.181 | 0.608 | 0.608 | 2.181 |
| −0.583 | 0.179 | 2.181 | −1.248 | 0.331 | 2.181 | 0.617 | 0.606 | 2.181 |
| −0.647 | 0.173 | 2.181 | −1.208 | 0.330 | 2.181 | 0.621 | 0.603 | 2.181 |
| −0.712 | 0.170 | 2.181 | −1.163 | 0.330 | 2.181 | 0.623 | 0.600 | 2.181 |
| −0.778 | 0.168 | 2.181 | −1.115 | 0.331 | 2.181 | 0.624 | 0.599 | 2.181 |
| −0.841 | 0.168 | 2.181 | −1.064 | 0.332 | 2.181 | 0.624 | 0.598 | 2.181 |

TABLE 10S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.903 | 0.169 | 2.181 | −1.012 | 0.334 | 2.181 | 0.624 | 0.597 | 2.181 |
| −0.962 | 0.173 | 2.181 | −0.957 | 0.337 | 2.181 | | | |
| −1.019 | 0.178 | 2.181 | −0.900 | 0.340 | 2.181 | | | |
| 0.679 | 0.547 | 2.908 | −0.985 | 0.166 | 2.908 | −0.756 | 0.308 | 2.908 |
| 0.680 | 0.546 | 2.908 | −1.036 | 0.174 | 2.908 | −0.696 | 0.312 | 2.908 |
| 0.680 | 0.545 | 2.908 | −1.084 | 0.182 | 2.908 | −0.635 | 0.317 | 2.908 |
| 0.680 | 0.541 | 2.908 | −1.128 | 0.192 | 2.908 | −0.573 | 0.323 | 2.908 |
| 0.679 | 0.536 | 2.908 | −1.168 | 0.201 | 2.908 | −0.511 | 0.329 | 2.908 |
| 0.674 | 0.528 | 2.908 | −1.203 | 0.211 | 2.908 | −0.450 | 0.337 | 2.908 |
| 0.663 | 0.522 | 2.908 | −1.234 | 0.220 | 2.908 | −0.388 | 0.345 | 2.908 |
| 0.647 | 0.515 | 2.908 | −1.260 | 0.229 | 2.908 | −0.327 | 0.354 | 2.908 |
| 0.627 | 0.506 | 2.908 | −1.283 | 0.237 | 2.908 | −0.266 | 0.362 | 2.908 |
| 0.602 | 0.494 | 2.908 | −1.302 | 0.245 | 2.908 | −0.204 | 0.371 | 2.908 |
| 0.573 | 0.481 | 2.908 | −1.317 | 0.252 | 2.908 | −0.143 | 0.381 | 2.908 |
| 0.541 | 0.467 | 2.908 | −1.329 | 0.259 | 2.908 | −0.082 | 0.391 | 2.908 |
| 0.506 | 0.452 | 2.908 | −1.338 | 0.265 | 2.908 | −0.021 | 0.401 | 2.908 |
| 0.466 | 0.434 | 2.908 | −1.345 | 0.271 | 2.908 | 0.040 | 0.412 | 2.908 |
| 0.423 | 0.416 | 2.908 | −1.349 | 0.276 | 2.908 | 0.099 | 0.423 | 2.908 |
| 0.377 | 0.397 | 2.908 | −1.351 | 0.281 | 2.908 | 0.156 | 0.434 | 2.908 |
| 0.330 | 0.377 | 2.908 | −1.352 | 0.286 | 2.908 | 0.210 | 0.445 | 2.908 |
| 0.280 | 0.357 | 2.908 | −1.351 | 0.289 | 2.908 | 0.263 | 0.457 | 2.908 |
| 0.228 | 0.336 | 2.908 | −1.350 | 0.292 | 2.908 | 0.313 | 0.468 | 2.908 |
| 0.173 | 0.316 | 2.908 | −1.348 | 0.295 | 2.908 | 0.362 | 0.479 | 2.908 |
| 0.117 | 0.295 | 2.908 | −1.344 | 0.299 | 2.908 | 0.408 | 0.490 | 2.908 |
| 0.058 | 0.275 | 2.908 | −1.338 | 0.301 | 2.908 | 0.452 | 0.502 | 2.908 |
| −0.004 | 0.255 | 2.908 | −1.330 | 0.304 | 2.908 | 0.492 | 0.512 | 2.908 |
| −0.065 | 0.237 | 2.908 | −1.320 | 0.306 | 2.908 | 0.528 | 0.522 | 2.908 |
| −0.127 | 0.220 | 2.908 | −1.307 | 0.307 | 2.908 | 0.560 | 0.530 | 2.908 |
| −0.190 | 0.204 | 2.908 | −1.290 | 0.308 | 2.908 | 0.590 | 0.539 | 2.908 |
| −0.253 | 0.191 | 2.908 | −1.271 | 0.307 | 2.908 | 0.616 | 0.546 | 2.908 |
| −0.316 | 0.179 | 2.908 | −1.248 | 0.306 | 2.908 | 0.635 | 0.552 | 2.908 |
| −0.379 | 0.169 | 2.908 | −1.221 | 0.305 | 2.908 | 0.651 | 0.556 | 2.908 |
| −0.443 | 0.161 | 2.908 | −1.190 | 0.304 | 2.908 | 0.663 | 0.559 | 2.908 |
| −0.506 | 0.155 | 2.908 | −1.155 | 0.303 | 2.908 | 0.672 | 0.556 | 2.908 |
| −0.570 | 0.151 | 2.908 | −1.116 | 0.302 | 2.908 | 0.676 | 0.553 | 2.908 |
| −0.633 | 0.148 | 2.908 | −1.072 | 0.301 | 2.908 | 0.678 | 0.550 | 2.908 |
| −0.697 | 0.147 | 2.908 | −1.025 | 0.300 | 2.908 | 0.679 | 0.549 | 2.908 |
| −0.759 | 0.148 | 2.908 | −0.975 | 0.300 | 2.908 | 0.679 | 0.548 | 2.908 |
| −0.819 | 0.150 | 2.908 | −0.923 | 0.301 | 2.908 | 0.679 | 0.548 | 2.908 |
| −0.876 | 0.154 | 2.908 | −0.870 | 0.302 | 2.908 | | | |
| −0.932 | 0.160 | 2.908 | −0.814 | 0.305 | 2.908 | | | |
| 0.813 | 0.405 | 3.634 | −0.835 | 0.052 | 3.634 | −0.608 | 0.174 | 3.634 |
| 0.813 | 0.405 | 3.634 | −0.885 | 0.061 | 3.634 | −0.548 | 0.177 | 3.634 |
| 0.814 | 0.403 | 3.634 | −0.933 | 0.070 | 3.634 | −0.487 | 0.181 | 3.634 |
| 0.814 | 0.399 | 3.634 | −0.976 | 0.080 | 3.634 | −0.426 | 0.186 | 3.634 |
| 0.813 | 0.394 | 3.634 | −1.016 | 0.090 | 3.634 | −0.365 | 0.191 | 3.634 |
| 0.808 | 0.386 | 3.634 | −1.050 | 0.100 | 3.634 | −0.304 | 0.198 | 3.634 |
| 0.797 | 0.380 | 3.634 | −1.081 | 0.109 | 3.634 | −0.243 | 0.205 | 3.634 |
| 0.781 | 0.373 | 3.634 | −1.107 | 0.118 | 3.634 | −0.182 | 0.213 | 3.634 |
| 0.762 | 0.364 | 3.634 | −1.129 | 0.126 | 3.634 | −0.121 | 0.221 | 3.634 |
| 0.737 | 0.353 | 3.634 | −1.148 | 0.133 | 3.634 | −0.061 | 0.230 | 3.634 |
| 0.708 | 0.340 | 3.634 | −1.163 | 0.140 | 3.634 | 0.000 | 0.239 | 3.634 |
| 0.677 | 0.326 | 3.634 | −1.175 | 0.147 | 3.634 | 0.060 | 0.249 | 3.634 |
| 0.642 | 0.311 | 3.634 | −1.184 | 0.154 | 3.634 | 0.121 | 0.259 | 3.634 |
| 0.602 | 0.294 | 3.634 | −1.190 | 0.159 | 3.634 | 0.181 | 0.270 | 3.634 |
| 0.559 | 0.276 | 3.634 | −1.194 | 0.165 | 3.634 | 0.239 | 0.280 | 3.634 |
| 0.514 | 0.257 | 3.634 | −1.197 | 0.169 | 3.634 | 0.296 | 0.291 | 3.634 |
| 0.467 | 0.238 | 3.634 | −1.198 | 0.174 | 3.634 | 0.350 | 0.303 | 3.634 |
| 0.417 | 0.219 | 3.634 | −1.197 | 0.177 | 3.634 | 0.402 | 0.314 | 3.634 |
| 0.366 | 0.199 | 3.634 | −1.196 | 0.180 | 3.634 | 0.452 | 0.325 | 3.634 |
| 0.312 | 0.180 | 3.634 | −1.194 | 0.183 | 3.634 | 0.499 | 0.336 | 3.634 |
| 0.255 | 0.160 | 3.634 | −1.189 | 0.186 | 3.634 | 0.545 | 0.348 | 3.634 |
| 0.197 | 0.141 | 3.634 | −1.184 | 0.188 | 3.634 | 0.589 | 0.359 | 3.634 |
| 0.136 | 0.123 | 3.634 | −1.176 | 0.191 | 3.634 | 0.628 | 0.369 | 3.634 |
| 0.075 | 0.106 | 3.634 | −1.165 | 0.192 | 3.634 | 0.664 | 0.379 | 3.634 |
| 0.013 | 0.090 | 3.634 | −1.152 | 0.193 | 3.634 | 0.695 | 0.388 | 3.634 |
| −0.049 | 0.076 | 3.634 | −1.136 | 0.192 | 3.634 | 0.725 | 0.397 | 3.634 |
| −0.112 | 0.063 | 3.634 | −1.117 | 0.191 | 3.634 | 0.750 | 0.404 | 3.634 |
| −0.174 | 0.053 | 3.634 | −1.094 | 0.189 | 3.634 | 0.770 | 0.410 | 3.634 |
| −0.237 | 0.045 | 3.634 | −1.068 | 0.187 | 3.634 | 0.785 | 0.415 | 3.634 |
| −0.300 | 0.038 | 3.634 | −1.037 | 0.185 | 3.634 | 0.797 | 0.417 | 3.634 |
| −0.362 | 0.033 | 3.634 | −1.002 | 0.182 | 3.634 | 0.806 | 0.414 | 3.634 |
| −0.425 | 0.030 | 3.634 | −0.964 | 0.179 | 3.634 | 0.810 | 0.411 | 3.634 |
| −0.488 | 0.028 | 3.634 | −0.921 | 0.177 | 3.634 | 0.812 | 0.408 | 3.634 |
| −0.551 | 0.028 | 3.634 | −0.874 | 0.175 | 3.634 | 0.813 | 0.407 | 3.634 |
| −0.612 | 0.030 | 3.634 | −0.825 | 0.173 | 3.634 | 0.813 | 0.406 | 3.634 |
| −0.671 | 0.034 | 3.634 | −0.773 | 0.172 | 3.634 | 0.813 | 0.406 | 3.634 |

TABLE 10S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.728 | 0.038 | 3.634 | −0.720 | 0.172 | 3.634 | | | |
| −0.782 | 0.045 | 3.634 | −0.665 | 0.173 | 3.634 | | | |
| 1.012 | 0.194 | 4.361 | −0.654 | −0.114 | 4.361 | −0.423 | −0.015 | 4.361 |
| 1.013 | 0.193 | 4.361 | −0.704 | −0.104 | 4.361 | −0.363 | −0.015 | 4.361 |
| 1.013 | 0.192 | 4.361 | −0.752 | −0.092 | 4.361 | −0.301 | −0.013 | 4.361 |
| 1.013 | 0.188 | 4.361 | −0.796 | −0.080 | 4.361 | −0.239 | −0.011 | 4.361 |
| 1.012 | 0.183 | 4.361 | −0.835 | −0.069 | 4.361 | −0.177 | −0.007 | 4.361 |
| 1.007 | 0.175 | 4.361 | −0.869 | −0.058 | 4.361 | −0.116 | −0.003 | 4.361 |
| 0.996 | 0.169 | 4.361 | −0.900 | −0.047 | 4.361 | −0.054 | 0.003 | 4.361 |
| 0.981 | 0.162 | 4.361 | −0.926 | −0.038 | 4.361 | 0.007 | 0.010 | 4.361 |
| 0.961 | 0.153 | 4.361 | −0.948 | −0.029 | 4.361 | 0.069 | 0.017 | 4.361 |
| 0.936 | 0.142 | 4.361 | −0.967 | −0.021 | 4.361 | 0.130 | 0.025 | 4.361 |
| 0.906 | 0.129 | 4.361 | −0.982 | −0.014 | 4.361 | 0.191 | 0.033 | 4.361 |
| 0.875 | 0.116 | 4.361 | −0.994 | −0.007 | 4.361 | 0.252 | 0.042 | 4.361 |
| 0.839 | 0.101 | 4.361 | −1.003 | 0.000 | 4.361 | 0.314 | 0.051 | 4.361 |
| 0.799 | 0.085 | 4.361 | −1.009 | 0.005 | 4.361 | 0.374 | 0.061 | 4.361 |
| 0.756 | 0.068 | 4.361 | −1.014 | 0.011 | 4.361 | 0.433 | 0.071 | 4.361 |
| 0.710 | 0.050 | 4.361 | −1.016 | 0.015 | 4.361 | 0.490 | 0.082 | 4.361 |
| 0.662 | 0.031 | 4.361 | −1.017 | 0.020 | 4.361 | 0.545 | 0.092 | 4.361 |
| 0.612 | 0.013 | 4.361 | −1.016 | 0.023 | 4.361 | 0.597 | 0.103 | 4.361 |
| 0.559 | −0.006 | 4.361 | −1.015 | 0.026 | 4.361 | 0.648 | 0.114 | 4.361 |
| 0.505 | −0.024 | 4.361 | −1.012 | 0.029 | 4.361 | 0.696 | 0.125 | 4.361 |
| 0.448 | −0.042 | 4.361 | −1.008 | 0.031 | 4.361 | 0.742 | 0.136 | 4.361 |
| 0.388 | −0.060 | 4.361 | −1.002 | 0.033 | 4.361 | 0.786 | 0.148 | 4.361 |
| 0.326 | −0.077 | 4.361 | −0.994 | 0.035 | 4.361 | 0.826 | 0.158 | 4.361 |
| 0.264 | −0.093 | 4.361 | −0.983 | 0.035 | 4.361 | 0.862 | 0.168 | 4.361 |
| 0.201 | −0.107 | 4.361 | −0.970 | 0.035 | 4.361 | 0.893 | 0.177 | 4.361 |
| 0.139 | −0.119 | 4.361 | −0.953 | 0.033 | 4.361 | 0.923 | 0.186 | 4.361 |
| 0.075 | −0.129 | 4.361 | −0.934 | 0.031 | 4.361 | 0.949 | 0.193 | 4.361 |
| 0.012 | −0.137 | 4.361 | −0.912 | 0.027 | 4.361 | 0.969 | 0.199 | 4.361 |
| −0.052 | −0.144 | 4.361 | −0.885 | 0.024 | 4.361 | 0.984 | 0.204 | 4.361 |
| −0.116 | −0.148 | 4.361 | −0.854 | 0.019 | 4.361 | 0.997 | 0.206 | 4.361 |
| −0.179 | −0.151 | 4.361 | −0.820 | 0.014 | 4.361 | 1.005 | 0.203 | 4.361 |
| −0.243 | −0.152 | 4.361 | −0.781 | 0.009 | 4.361 | 1.009 | 0.200 | 4.361 |
| −0.307 | −0.152 | 4.361 | −0.738 | 0.004 | 4.361 | 1.011 | 0.197 | 4.361 |
| −0.370 | −0.149 | 4.361 | −0.690 | −0.001 | 4.361 | 1.012 | 0.196 | 4.361 |
| −0.431 | −0.145 | 4.361 | −0.641 | −0.005 | 4.361 | 1.012 | 0.195 | 4.361 |
| −0.490 | −0.140 | 4.361 | −0.590 | −0.009 | 4.361 | 1.012 | 0.195 | 4.361 |
| −0.547 | −0.132 | 4.361 | −0.536 | −0.012 | 4.361 | | | |
| −0.602 | −0.124 | 4.361 | −0.480 | −0.014 | 4.361 | | | |
| 1.117 | 0.074 | 4.725 | −0.557 | −0.203 | 4.725 | −0.323 | −0.117 | 4.725 |
| 1.117 | 0.073 | 4.725 | −0.607 | −0.191 | 4.725 | −0.263 | −0.119 | 4.725 |
| 1.118 | 0.071 | 4.725 | −0.655 | −0.178 | 4.725 | −0.201 | −0.119 | 4.725 |
| 1.118 | 0.068 | 4.725 | −0.698 | −0.165 | 4.725 | −0.139 | −0.118 | 4.725 |
| 1.117 | 0.063 | 4.725 | −0.737 | −0.153 | 4.725 | −0.077 | −0.116 | 4.725 |
| 1.112 | 0.055 | 4.725 | −0.771 | −0.141 | 4.725 | −0.015 | −0.112 | 4.725 |
| 1.101 | 0.049 | 4.725 | −0.801 | −0.129 | 4.725 | 0.047 | −0.108 | 4.725 |
| 1.085 | 0.042 | 4.725 | −0.827 | −0.119 | 4.725 | 0.109 | −0.102 | 4.725 |
| 1.065 | 0.033 | 4.725 | −0.849 | −0.110 | 4.725 | 0.170 | −0.096 | 4.725 |
| 1.040 | 0.022 | 4.725 | −0.867 | −0.101 | 4.725 | 0.232 | −0.089 | 4.725 |
| 1.010 | 0.010 | 4.725 | −0.882 | −0.094 | 4.725 | 0.293 | −0.081 | 4.725 |
| 0.978 | −0.003 | 4.725 | −0.894 | −0.087 | 4.725 | 0.354 | −0.073 | 4.725 |
| 0.942 | −0.018 | 4.725 | −0.903 | −0.080 | 4.725 | 0.416 | −0.065 | 4.725 |
| 0.903 | −0.033 | 4.725 | −0.910 | −0.074 | 4.725 | 0.477 | −0.055 | 4.725 |
| 0.859 | −0.050 | 4.725 | −0.914 | −0.069 | 4.725 | 0.536 | −0.046 | 4.725 |
| 0.812 | −0.068 | 4.725 | −0.916 | −0.064 | 4.725 | 0.593 | −0.036 | 4.725 |
| 0.764 | −0.086 | 4.725 | −0.917 | −0.060 | 4.725 | 0.648 | −0.025 | 4.725 |
| 0.714 | −0.104 | 4.725 | −0.917 | −0.057 | 4.725 | 0.701 | −0.015 | 4.725 |
| 0.661 | −0.121 | 4.725 | −0.915 | −0.054 | 4.725 | 0.751 | −0.004 | 4.725 |
| 0.606 | −0.139 | 4.725 | −0.912 | −0.051 | 4.725 | 0.799 | 0.007 | 4.725 |
| 0.548 | −0.156 | 4.725 | −0.907 | −0.049 | 4.725 | 0.846 | 0.017 | 4.725 |
| 0.488 | −0.173 | 4.725 | −0.901 | −0.047 | 4.725 | 0.890 | 0.028 | 4.725 |
| 0.426 | −0.189 | 4.725 | −0.893 | −0.046 | 4.725 | 0.930 | 0.039 | 4.725 |
| 0.364 | −0.203 | 4.725 | −0.882 | −0.046 | 4.725 | 0.966 | 0.048 | 4.725 |
| 0.301 | −0.216 | 4.725 | −0.869 | −0.047 | 4.725 | 0.998 | 0.057 | 4.725 |
| 0.237 | −0.227 | 4.725 | −0.853 | −0.050 | 4.725 | 1.028 | 0.066 | 4.725 |
| 0.174 | −0.236 | 4.725 | −0.834 | −0.053 | 4.725 | 1.053 | 0.073 | 4.725 |
| 0.110 | −0.243 | 4.725 | −0.811 | −0.057 | 4.725 | 1.073 | 0.079 | 4.725 |
| 0.046 | −0.248 | 4.725 | −0.785 | −0.062 | 4.725 | 1.089 | 0.084 | 4.725 |
| −0.018 | −0.252 | 4.725 | −0.754 | −0.068 | 4.725 | 1.101 | 0.086 | 4.725 |
| −0.082 | −0.253 | 4.725 | −0.720 | −0.074 | 4.725 | 1.110 | 0.083 | 4.725 |
| −0.145 | −0.253 | 4.725 | −0.681 | −0.081 | 4.725 | 1.114 | 0.079 | 4.725 |
| −0.209 | −0.251 | 4.725 | −0.638 | −0.088 | 4.725 | 1.116 | 0.077 | 4.725 |
| −0.273 | −0.246 | 4.725 | −0.591 | −0.094 | 4.725 | 1.116 | 0.075 | 4.725 |
| −0.334 | −0.241 | 4.725 | −0.541 | −0.100 | 4.725 | 1.117 | 0.075 | 4.725 |
| −0.393 | −0.233 | 4.725 | −0.490 | −0.106 | 4.725 | 1.117 | 0.074 | 4.725 |
| −0.450 | −0.225 | 4.725 | −0.436 | −0.110 | 4.725 | | | |

TABLE 10S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.505 | −0.214 | 4.725 | −0.381 | −0.114 | 4.725 | | | |
| 1.222 | −0.037 | 5.088 | −0.470 | −0.271 | 5.088 | −0.233 | −0.204 | 5.088 |
| 1.222 | −0.038 | 5.088 | −0.520 | −0.257 | 5.088 | −0.173 | −0.208 | 5.088 |
| 1.223 | −0.039 | 5.088 | −0.568 | −0.242 | 5.088 | −0.110 | −0.212 | 5.088 |
| 1.223 | −0.043 | 5.088 | −0.611 | −0.226 | 5.088 | −0.048 | −0.214 | 5.088 |
| 1.222 | −0.048 | 5.088 | −0.649 | −0.212 | 5.088 | 0.014 | −0.214 | 5.088 |
| 1.216 | −0.057 | 5.088 | −0.684 | −0.198 | 5.088 | 0.077 | −0.214 | 5.088 |
| 1.205 | −0.063 | 5.088 | −0.714 | −0.185 | 5.088 | 0.139 | −0.211 | 5.088 |
| 1.189 | −0.069 | 5.088 | −0.739 | −0.174 | 5.088 | 0.202 | −0.208 | 5.088 |
| 1.169 | −0.078 | 5.088 | −0.761 | −0.163 | 5.088 | 0.264 | −0.204 | 5.088 |
| 1.143 | −0.089 | 5.088 | −0.779 | −0.154 | 5.088 | 0.327 | −0.198 | 5.088 |
| 1.113 | −0.102 | 5.088 | −0.794 | −0.146 | 5.088 | 0.389 | −0.192 | 5.088 |
| 1.081 | −0.115 | 5.088 | −0.806 | −0.138 | 5.088 | 0.451 | −0.185 | 5.088 |
| 1.045 | −0.130 | 5.088 | −0.815 | −0.131 | 5.088 | 0.513 | −0.177 | 5.088 |
| 1.005 | −0.146 | 5.088 | −0.822 | −0.125 | 5.088 | 0.575 | −0.169 | 5.088 |
| 0.960 | −0.163 | 5.088 | −0.826 | −0.119 | 5.088 | 0.635 | −0.159 | 5.088 |
| 0.914 | −0.181 | 5.088 | −0.828 | −0.114 | 5.088 | 0.693 | −0.149 | 5.088 |
| 0.865 | −0.199 | 5.088 | −0.829 | −0.110 | 5.088 | 0.748 | −0.139 | 5.088 |
| 0.814 | −0.217 | 5.088 | −0.828 | −0.107 | 5.088 | 0.802 | −0.129 | 5.088 |
| 0.760 | −0.234 | 5.088 | −0.826 | −0.104 | 5.088 | 0.853 | −0.118 | 5.088 |
| 0.705 | −0.251 | 5.088 | −0.823 | −0.102 | 5.088 | 0.902 | −0.107 | 5.088 |
| 0.647 | −0.268 | 5.088 | −0.818 | −0.100 | 5.088 | 0.948 | −0.096 | 5.088 |
| 0.586 | −0.284 | 5.088 | −0.812 | −0.099 | 5.088 | 0.993 | −0.084 | 5.088 |
| 0.524 | −0.298 | 5.088 | −0.804 | −0.098 | 5.088 | 1.033 | −0.073 | 5.088 |
| 0.460 | −0.311 | 5.088 | −0.793 | −0.099 | 5.088 | 1.069 | −0.063 | 5.088 |
| 0.397 | −0.322 | 5.088 | −0.779 | −0.101 | 5.088 | 1.102 | −0.054 | 5.088 |
| 0.333 | −0.331 | 5.088 | −0.763 | −0.105 | 5.088 | 1.132 | −0.046 | 5.088 |
| 0.268 | −0.337 | 5.088 | −0.744 | −0.110 | 5.088 | 1.158 | −0.038 | 5.088 |
| 0.203 | −0.342 | 5.088 | −0.722 | −0.116 | 5.088 | 1.178 | −0.032 | 5.088 |
| 0.138 | −0.345 | 5.088 | −0.696 | −0.123 | 5.088 | 1.194 | −0.027 | 5.088 |
| 0.073 | −0.345 | 5.088 | −0.665 | −0.130 | 5.088 | 1.206 | −0.024 | 5.088 |
| 0.008 | −0.344 | 5.088 | −0.631 | −0.139 | 5.088 | 1.215 | −0.027 | 5.088 |
| −0.056 | −0.341 | 5.088 | −0.592 | −0.148 | 5.088 | 1.219 | −0.031 | 5.088 |
| −0.120 | −0.336 | 5.088 | −0.549 | −0.157 | 5.088 | 1.221 | −0.034 | 5.088 |
| −0.184 | −0.329 | 5.088 | −0.502 | −0.166 | 5.088 | 1.221 | −0.035 | 5.088 |
| −0.246 | −0.320 | 5.088 | −0.453 | −0.175 | 5.088 | 1.222 | −0.036 | 5.088 |
| −0.305 | −0.310 | 5.088 | −0.401 | −0.184 | 5.088 | 1.222 | −0.036 | 5.088 |
| −0.363 | −0.298 | 5.088 | −0.347 | −0.191 | 5.088 | | | |
| −0.417 | −0.285 | 5.088 | −0.291 | −0.198 | 5.088 | | | |
| 1.341 | −0.155 | 5.452 | −0.411 | −0.286 | 5.452 | −0.161 | −0.256 | 5.452 |
| 1.341 | −0.156 | 5.452 | −0.461 | −0.266 | 5.452 | −0.099 | −0.267 | 5.452 |
| 1.341 | −0.158 | 5.452 | −0.509 | −0.245 | 5.452 | −0.035 | −0.278 | 5.452 |
| 1.341 | −0.161 | 5.452 | −0.552 | −0.225 | 5.452 | 0.029 | −0.286 | 5.452 |
| 1.340 | −0.167 | 5.452 | −0.590 | −0.205 | 5.452 | 0.093 | −0.293 | 5.452 |
| 1.335 | −0.175 | 5.452 | −0.624 | −0.188 | 5.452 | 0.157 | −0.298 | 5.452 |
| 1.323 | −0.181 | 5.452 | −0.654 | −0.171 | 5.452 | 0.221 | −0.301 | 5.452 |
| 1.306 | −0.188 | 5.452 | −0.679 | −0.156 | 5.452 | 0.285 | −0.303 | 5.452 |
| 1.285 | −0.197 | 5.452 | −0.700 | −0.144 | 5.452 | 0.349 | −0.302 | 5.452 |
| 1.258 | −0.209 | 5.452 | −0.718 | −0.132 | 5.452 | 0.413 | −0.301 | 5.452 |
| 1.227 | −0.222 | 5.452 | −0.733 | −0.122 | 5.452 | 0.477 | −0.298 | 5.452 |
| 1.194 | −0.235 | 5.452 | −0.745 | −0.113 | 5.452 | 0.541 | −0.294 | 5.452 |
| 1.156 | −0.250 | 5.452 | −0.753 | −0.106 | 5.452 | 0.605 | −0.288 | 5.452 |
| 1.114 | −0.266 | 5.452 | −0.759 | −0.099 | 5.452 | 0.669 | −0.282 | 5.452 |
| 1.067 | −0.284 | 5.452 | −0.763 | −0.093 | 5.452 | 0.731 | −0.274 | 5.452 |
| 1.018 | −0.302 | 5.452 | −0.765 | −0.088 | 5.452 | 0.791 | −0.266 | 5.452 |
| 0.967 | −0.319 | 5.452 | −0.766 | −0.083 | 5.452 | 0.848 | −0.257 | 5.452 |
| 0.914 | −0.337 | 5.452 | −0.765 | −0.080 | 5.452 | 0.904 | −0.247 | 5.452 |
| 0.857 | −0.353 | 5.452 | −0.763 | −0.077 | 5.452 | 0.957 | −0.237 | 5.452 |
| 0.799 | −0.369 | 5.452 | −0.759 | −0.075 | 5.452 | 1.008 | −0.226 | 5.452 |
| 0.738 | −0.384 | 5.452 | −0.753 | −0.074 | 5.452 | 1.056 | −0.215 | 5.452 |
| 0.674 | −0.397 | 5.452 | −0.747 | −0.074 | 5.452 | 1.103 | −0.204 | 5.452 |
| 0.609 | −0.409 | 5.452 | −0.738 | −0.075 | 5.452 | 1.145 | −0.193 | 5.452 |
| 0.543 | −0.418 | 5.452 | −0.727 | −0.078 | 5.452 | 1.182 | −0.183 | 5.452 |
| 0.476 | −0.425 | 5.452 | −0.714 | −0.082 | 5.452 | 1.216 | −0.173 | 5.452 |
| 0.410 | −0.429 | 5.452 | −0.698 | −0.088 | 5.452 | 1.247 | −0.164 | 5.452 |
| 0.343 | −0.431 | 5.452 | −0.679 | −0.096 | 5.452 | 1.274 | −0.157 | 5.452 |
| 0.275 | −0.430 | 5.452 | −0.657 | −0.105 | 5.452 | 1.295 | −0.150 | 5.452 |
| 0.208 | −0.427 | 5.452 | −0.630 | −0.116 | 5.452 | 1.311 | −0.145 | 5.452 |
| 0.140 | −0.422 | 5.452 | −0.600 | −0.128 | 5.452 | 1.324 | −0.143 | 5.452 |
| 0.073 | −0.414 | 5.452 | −0.565 | −0.141 | 5.452 | 1.333 | −0.145 | 5.452 |
| 0.007 | −0.404 | 5.452 | −0.526 | −0.155 | 5.452 | 1.337 | −0.149 | 5.452 |
| −0.059 | −0.391 | 5.452 | −0.483 | −0.170 | 5.452 | 1.339 | −0.152 | 5.452 |
| −0.124 | −0.377 | 5.452 | −0.435 | −0.185 | 5.452 | 1.340 | −0.153 | 5.452 |
| −0.187 | −0.361 | 5.452 | −0.385 | −0.200 | 5.452 | 1.340 | −0.154 | 5.452 |
| −0.247 | −0.344 | 5.452 | −0.333 | −0.215 | 5.452 | 1.340 | −0.155 | 5.452 |
| −0.304 | −0.325 | 5.452 | −0.278 | −0.229 | 5.452 | | | |
| −0.359 | −0.306 | 5.452 | −0.221 | −0.243 | 5.452 | | | |

TABLE 10S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.474 | −0.275 | 5.815 | −0.362 | −0.259 | 5.815 | −0.104 | −0.268 | 5.815 |
| 1.474 | −0.276 | 5.815 | −0.411 | −0.232 | 5.815 | −0.041 | −0.288 | 5.815 |
| 1.474 | −0.278 | 5.815 | −0.458 | −0.205 | 5.815 | 0.025 | −0.306 | 5.815 |
| 1.474 | −0.281 | 5.815 | −0.501 | −0.179 | 5.815 | 0.091 | −0.323 | 5.815 |
| 1.473 | −0.287 | 5.815 | −0.538 | −0.154 | 5.815 | 0.158 | −0.337 | 5.815 |
| 1.467 | −0.295 | 5.815 | −0.572 | −0.131 | 5.815 | 0.225 | −0.349 | 5.815 |
| 1.453 | −0.301 | 5.815 | −0.601 | −0.111 | 5.815 | 0.292 | −0.359 | 5.815 |
| 1.436 | −0.308 | 5.815 | −0.625 | −0.092 | 5.815 | 0.359 | −0.367 | 5.815 |
| 1.414 | −0.316 | 5.815 | −0.646 | −0.077 | 5.815 | 0.427 | −0.373 | 5.815 |
| 1.385 | −0.327 | 5.815 | −0.664 | −0.063 | 5.815 | 0.494 | −0.376 | 5.815 |
| 1.351 | −0.339 | 5.815 | −0.678 | −0.051 | 5.815 | 0.561 | −0.378 | 5.815 |
| 1.315 | −0.352 | 5.815 | −0.689 | −0.041 | 5.815 | 0.629 | −0.379 | 5.815 |
| 1.275 | −0.366 | 5.815 | −0.698 | −0.031 | 5.815 | 0.696 | −0.379 | 5.815 |
| 1.230 | −0.381 | 5.815 | −0.703 | −0.024 | 5.815 | 0.764 | −0.376 | 5.815 |
| 1.180 | −0.398 | 5.815 | −0.707 | −0.017 | 5.815 | 0.829 | −0.373 | 5.815 |
| 1.128 | −0.414 | 5.815 | −0.709 | −0.012 | 5.815 | 0.892 | −0.368 | 5.815 |
| 1.073 | −0.429 | 5.815 | −0.709 | −0.007 | 5.815 | 0.953 | −0.362 | 5.815 |
| 1.016 | −0.444 | 5.815 | −0.708 | −0.004 | 5.815 | 1.011 | −0.355 | 5.815 |
| 0.956 | −0.458 | 5.815 | −0.705 | −0.001 | 5.815 | 1.068 | −0.347 | 5.815 |
| 0.893 | −0.470 | 5.815 | −0.701 | 0.000 | 5.815 | 1.122 | −0.338 | 5.815 |
| 0.827 | −0.481 | 5.815 | −0.695 | 0.000 | 5.815 | 1.173 | −0.328 | 5.815 |
| 0.759 | −0.489 | 5.815 | −0.688 | −0.001 | 5.815 | 1.222 | −0.318 | 5.815 |
| 0.689 | −0.496 | 5.815 | −0.679 | −0.004 | 5.815 | 1.266 | −0.308 | 5.815 |
| 0.618 | −0.499 | 5.815 | −0.668 | −0.008 | 5.815 | 1.306 | −0.299 | 5.815 |
| 0.548 | −0.500 | 5.815 | −0.655 | −0.015 | 5.815 | 1.342 | −0.290 | 5.815 |
| 0.478 | −0.498 | 5.815 | −0.640 | −0.024 | 5.815 | 1.375 | −0.282 | 5.815 |
| 0.408 | −0.494 | 5.815 | −0.621 | −0.035 | 5.815 | 1.403 | −0.275 | 5.815 |
| 0.338 | −0.486 | 5.815 | −0.599 | −0.048 | 5.815 | 1.425 | −0.269 | 5.815 |
| 0.268 | −0.476 | 5.815 | −0.573 | −0.062 | 5.815 | 1.443 | −0.264 | 5.815 |
| 0.198 | −0.463 | 5.815 | −0.543 | −0.079 | 5.815 | 1.456 | −0.262 | 5.815 |
| 0.129 | −0.448 | 5.815 | −0.509 | −0.097 | 5.815 | 1.466 | −0.265 | 5.815 |
| 0.060 | −0.430 | 5.815 | −0.471 | −0.117 | 5.815 | 1.470 | −0.268 | 5.815 |
| −0.007 | −0.409 | 5.815 | −0.428 | −0.139 | 5.815 | 1.472 | −0.271 | 5.815 |
| −0.073 | −0.387 | 5.815 | −0.380 | −0.161 | 5.815 | 1.473 | −0.273 | 5.815 |
| −0.137 | −0.363 | 5.815 | −0.330 | −0.183 | 5.815 | 1.474 | −0.274 | 5.815 |
| −0.197 | −0.337 | 5.815 | −0.277 | −0.205 | 5.815 | 1.474 | −0.274 | 5.815 |
| −0.255 | −0.312 | 5.815 | −0.222 | −0.227 | 5.815 | | | |
| −0.310 | −0.286 | 5.815 | −0.164 | −0.248 | 5.815 | | | |

The coordinate values given in TABLE 11S below provide the nominal profile envelope for an exemplary eleventh stage stator.

TABLE 11S

| X-LOC | Y-LOC | Z-LOC | X-LOC | Y-LOC | Z-LOC | X-LOC | Y-LOC | Z-LOC |
|---|---|---|---|---|---|---|---|---|
| 1.710 | 0.098 | 0.000 | −0.653 | −0.095 | 0.000 | −0.300 | 0.015 | 0.000 |
| 1.711 | 0.097 | 0.000 | −0.720 | −0.067 | 0.000 | −0.218 | 0.004 | 0.000 |
| 1.711 | 0.094 | 0.000 | −0.782 | −0.039 | 0.000 | −0.132 | −0.005 | 0.000 |
| 1.712 | 0.089 | 0.000 | −0.839 | −0.011 | 0.000 | −0.047 | −0.012 | 0.000 |
| 1.711 | 0.082 | 0.000 | −0.889 | 0.016 | 0.000 | 0.039 | −0.018 | 0.000 |
| 1.705 | 0.070 | 0.000 | −0.933 | 0.041 | 0.000 | 0.125 | −0.022 | 0.000 |
| 1.690 | 0.060 | 0.000 | −0.972 | 0.065 | 0.000 | 0.211 | −0.025 | 0.000 |
| 1.667 | 0.052 | 0.000 | −1.004 | 0.086 | 0.000 | 0.297 | −0.027 | 0.000 |
| 1.639 | 0.041 | 0.000 | −1.032 | 0.105 | 0.000 | 0.383 | −0.028 | 0.000 |
| 1.602 | 0.028 | 0.000 | −1.054 | 0.123 | 0.000 | 0.470 | −0.028 | 0.000 |
| 1.560 | 0.013 | 0.000 | −1.072 | 0.138 | 0.000 | 0.556 | −0.028 | 0.000 |
| 1.515 | −0.004 | 0.000 | −1.086 | 0.152 | 0.000 | 0.642 | −0.026 | 0.000 |
| 1.464 | −0.022 | 0.000 | −1.097 | 0.164 | 0.000 | 0.728 | −0.023 | 0.000 |
| 1.407 | −0.042 | 0.000 | −1.104 | 0.173 | 0.000 | 0.814 | −0.019 | 0.000 |
| 1.344 | −0.062 | 0.000 | −1.108 | 0.181 | 0.000 | 0.897 | −0.014 | 0.000 |
| 1.278 | −0.083 | 0.000 | −1.110 | 0.189 | 0.000 | 0.977 | −0.008 | 0.000 |
| 1.208 | −0.104 | 0.000 | −1.111 | 0.195 | 0.000 | 1.054 | 0.000 | 0.000 |
| 1.136 | −0.124 | 0.000 | −1.109 | 0.199 | 0.000 | 1.128 | 0.008 | 0.000 |
| 1.060 | −0.143 | 0.000 | −1.106 | 0.202 | 0.000 | 1.199 | 0.017 | 0.000 |
| 0.981 | −0.161 | 0.000 | −1.101 | 0.205 | 0.000 | 1.267 | 0.027 | 0.000 |
| 0.899 | −0.179 | 0.000 | −1.095 | 0.207 | 0.000 | 1.332 | 0.038 | 0.000 |
| 0.813 | −0.195 | 0.000 | −1.086 | 0.208 | 0.000 | 1.394 | 0.050 | 0.000 |
| 0.724 | −0.210 | 0.000 | −1.074 | 0.207 | 0.000 | 1.451 | 0.061 | 0.000 |
| 0.635 | −0.223 | 0.000 | −1.060 | 0.205 | 0.000 | 1.501 | 0.072 | 0.000 |
| 0.545 | −0.233 | 0.000 | −1.041 | 0.201 | 0.000 | 1.546 | 0.083 | 0.000 |
| 0.455 | −0.242 | 0.000 | −1.019 | 0.195 | 0.000 | 1.588 | 0.094 | 0.000 |

TABLE 11S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.365 | −0.247 | 0.000 | −0.994 | 0.187 | 0.000 | 1.624 | 0.104 | 0.000 |
| 0.275 | −0.250 | 0.000 | −0.964 | 0.178 | 0.000 | 1.651 | 0.112 | 0.000 |
| 0.185 | −0.251 | 0.000 | −0.928 | 0.166 | 0.000 | 1.674 | 0.118 | 0.000 |
| 0.095 | −0.248 | 0.000 | −0.887 | 0.152 | 0.000 | 1.691 | 0.118 | 0.000 |
| 0.005 | −0.242 | 0.000 | −0.841 | 0.137 | 0.000 | 1.702 | 0.111 | 0.000 |
| −0.085 | −0.233 | 0.000 | −0.788 | 0.121 | 0.000 | 1.706 | 0.106 | 0.000 |
| −0.175 | −0.221 | 0.000 | −0.730 | 0.104 | 0.000 | 1.709 | 0.102 | 0.000 |
| −0.264 | −0.206 | 0.000 | −0.666 | 0.087 | 0.000 | 1.710 | 0.100 | 0.000 |
| −0.349 | −0.188 | 0.000 | −0.600 | 0.071 | 0.000 | 1.710 | 0.099 | 0.000 |
| −0.431 | −0.168 | 0.000 | −0.529 | 0.055 | 0.000 | 1.710 | 0.099 | 0.000 |
| −0.509 | −0.146 | 0.000 | −0.456 | 0.040 | 0.000 | | | |
| −0.583 | −0.121 | 0.000 | −0.380 | 0.027 | 0.000 | | | |
| 1.388 | 0.485 | 0.729 | −0.740 | 0.060 | 0.729 | −0.436 | 0.221 | 0.729 |
| 1.389 | 0.484 | 0.729 | −0.804 | 0.075 | 0.729 | −0.360 | 0.221 | 0.729 |
| 1.389 | 0.482 | 0.729 | −0.864 | 0.091 | 0.729 | −0.281 | 0.224 | 0.729 |
| 1.390 | 0.477 | 0.729 | −0.919 | 0.107 | 0.729 | −0.202 | 0.227 | 0.729 |
| 1.389 | 0.470 | 0.729 | −0.968 | 0.123 | 0.729 | −0.124 | 0.232 | 0.729 |
| 1.385 | 0.459 | 0.729 | −1.012 | 0.139 | 0.729 | −0.045 | 0.238 | 0.729 |
| 1.372 | 0.449 | 0.729 | −1.050 | 0.154 | 0.729 | 0.033 | 0.245 | 0.729 |
| 1.352 | 0.440 | 0.729 | −1.083 | 0.168 | 0.729 | 0.111 | 0.253 | 0.729 |
| 1.327 | 0.430 | 0.729 | −1.110 | 0.180 | 0.729 | 0.190 | 0.261 | 0.729 |
| 1.294 | 0.416 | 0.729 | −1.133 | 0.192 | 0.729 | 0.268 | 0.270 | 0.729 |
| 1.256 | 0.400 | 0.729 | −1.152 | 0.203 | 0.729 | 0.346 | 0.280 | 0.729 |
| 1.216 | 0.383 | 0.729 | −1.166 | 0.214 | 0.729 | 0.424 | 0.291 | 0.729 |
| 1.170 | 0.364 | 0.729 | −1.177 | 0.223 | 0.729 | 0.501 | 0.303 | 0.729 |
| 1.120 | 0.343 | 0.729 | −1.185 | 0.231 | 0.729 | 0.579 | 0.315 | 0.729 |
| 1.064 | 0.321 | 0.729 | −1.190 | 0.238 | 0.729 | 0.654 | 0.328 | 0.729 |
| 1.005 | 0.297 | 0.729 | −1.193 | 0.244 | 0.729 | 0.727 | 0.341 | 0.729 |
| 0.944 | 0.273 | 0.729 | −1.194 | 0.250 | 0.729 | 0.796 | 0.355 | 0.729 |
| 0.880 | 0.249 | 0.729 | −1.193 | 0.254 | 0.729 | 0.863 | 0.369 | 0.729 |
| 0.813 | 0.225 | 0.729 | −1.191 | 0.257 | 0.729 | 0.927 | 0.383 | 0.729 |
| 0.743 | 0.201 | 0.729 | −1.187 | 0.261 | 0.729 | 0.988 | 0.397 | 0.729 |
| 0.671 | 0.177 | 0.729 | −1.182 | 0.264 | 0.729 | 1.047 | 0.412 | 0.729 |
| 0.595 | 0.153 | 0.729 | −1.174 | 0.267 | 0.729 | 1.103 | 0.426 | 0.729 |
| 0.516 | 0.130 | 0.729 | −1.164 | 0.269 | 0.729 | 1.154 | 0.440 | 0.729 |
| 0.437 | 0.109 | 0.729 | −1.151 | 0.271 | 0.729 | 1.199 | 0.453 | 0.729 |
| 0.357 | 0.089 | 0.729 | −1.133 | 0.271 | 0.729 | 1.239 | 0.465 | 0.729 |
| 0.277 | 0.071 | 0.729 | −1.113 | 0.270 | 0.729 | 1.277 | 0.477 | 0.729 |
| 0.197 | 0.055 | 0.729 | −1.088 | 0.268 | 0.729 | 1.309 | 0.488 | 0.729 |
| 0.116 | 0.041 | 0.729 | −1.059 | 0.265 | 0.729 | 1.334 | 0.496 | 0.729 |
| 0.035 | 0.030 | 0.729 | −1.025 | 0.261 | 0.729 | 1.354 | 0.503 | 0.729 |
| −0.047 | 0.021 | 0.729 | −0.986 | 0.256 | 0.729 | 1.370 | 0.503 | 0.729 |
| −0.129 | 0.015 | 0.729 | −0.942 | 0.251 | 0.729 | 1.380 | 0.497 | 0.729 |
| −0.211 | 0.012 | 0.729 | −0.892 | 0.245 | 0.729 | 1.384 | 0.492 | 0.729 |
| −0.293 | 0.012 | 0.729 | −0.837 | 0.240 | 0.729 | 1.387 | 0.489 | 0.729 |
| −0.375 | 0.014 | 0.729 | −0.777 | 0.234 | 0.729 | 1.388 | 0.487 | 0.729 |
| −0.454 | 0.019 | 0.729 | −0.714 | 0.230 | 0.729 | 1.388 | 0.486 | 0.729 |
| −0.530 | 0.026 | 0.729 | −0.649 | 0.226 | 0.729 | 1.388 | 0.485 | 0.729 |
| −0.603 | 0.036 | 0.729 | −0.580 | 0.223 | 0.729 | | | |
| −0.673 | 0.047 | 0.729 | −0.510 | 0.221 | 0.729 | | | |
| 1.145 | 0.716 | 1.458 | −0.828 | 0.263 | 1.458 | −0.552 | 0.426 | 1.458 |
| 1.145 | 0.715 | 1.458 | −0.888 | 0.274 | 1.458 | −0.481 | 0.430 | 1.458 |
| 1.146 | 0.713 | 1.458 | −0.945 | 0.286 | 1.458 | −0.408 | 0.435 | 1.458 |
| 1.146 | 0.709 | 1.458 | −0.996 | 0.299 | 1.458 | −0.335 | 0.441 | 1.458 |
| 1.146 | 0.702 | 1.458 | −1.043 | 0.311 | 1.458 | −0.261 | 0.448 | 1.458 |
| 1.140 | 0.692 | 1.458 | −1.084 | 0.324 | 1.458 | −0.188 | 0.456 | 1.458 |
| 1.128 | 0.684 | 1.458 | −1.120 | 0.336 | 1.458 | −0.115 | 0.464 | 1.458 |
| 1.109 | 0.676 | 1.458 | −1.152 | 0.347 | 1.458 | −0.043 | 0.474 | 1.458 |
| 1.085 | 0.667 | 1.458 | −1.178 | 0.357 | 1.458 | 0.030 | 0.484 | 1.458 |
| 1.055 | 0.654 | 1.458 | −1.199 | 0.367 | 1.458 | 0.103 | 0.495 | 1.458 |
| 1.019 | 0.640 | 1.458 | −1.217 | 0.377 | 1.458 | 0.175 | 0.507 | 1.458 |
| 0.982 | 0.624 | 1.458 | −1.231 | 0.385 | 1.458 | 0.247 | 0.520 | 1.458 |
| 0.940 | 0.606 | 1.458 | −1.242 | 0.394 | 1.458 | 0.320 | 0.533 | 1.458 |
| 0.893 | 0.587 | 1.458 | −1.249 | 0.401 | 1.458 | 0.392 | 0.547 | 1.458 |
| 0.841 | 0.565 | 1.458 | −1.254 | 0.407 | 1.458 | 0.461 | 0.561 | 1.458 |
| 0.787 | 0.543 | 1.458 | −1.257 | 0.412 | 1.458 | 0.528 | 0.576 | 1.458 |
| 0.730 | 0.520 | 1.458 | −1.258 | 0.418 | 1.458 | 0.593 | 0.590 | 1.458 |
| 0.671 | 0.496 | 1.458 | −1.258 | 0.421 | 1.458 | 0.655 | 0.604 | 1.458 |
| 0.610 | 0.472 | 1.458 | −1.256 | 0.425 | 1.458 | 0.715 | 0.618 | 1.458 |
| 0.545 | 0.448 | 1.458 | −1.253 | 0.429 | 1.458 | 0.772 | 0.632 | 1.458 |
| 0.478 | 0.424 | 1.458 | −1.248 | 0.432 | 1.458 | 0.826 | 0.646 | 1.458 |
| 0.409 | 0.399 | 1.458 | −1.242 | 0.435 | 1.458 | 0.878 | 0.660 | 1.458 |
| 0.337 | 0.375 | 1.458 | −1.232 | 0.438 | 1.458 | 0.925 | 0.673 | 1.458 |
| 0.264 | 0.352 | 1.458 | −1.220 | 0.440 | 1.458 | 0.968 | 0.685 | 1.458 |
| 0.191 | 0.331 | 1.458 | −1.204 | 0.441 | 1.458 | 1.005 | 0.696 | 1.458 |
| 0.117 | 0.311 | 1.458 | −1.184 | 0.442 | 1.458 | 1.040 | 0.707 | 1.458 |
| 0.043 | 0.294 | 1.458 | −1.161 | 0.441 | 1.458 | 1.071 | 0.717 | 1.458 |

TABLE 11S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.032 | 0.278 | 1.458 | −1.134 | 0.440 | 1.458 | 1.094 | 0.725 | 1.458 |
| −0.107 | 0.265 | 1.458 | −1.103 | 0.438 | 1.458 | 1.113 | 0.731 | 1.458 |
| −0.182 | 0.254 | 1.458 | −1.066 | 0.435 | 1.458 | 1.127 | 0.732 | 1.458 |
| −0.258 | 0.246 | 1.458 | −1.024 | 0.433 | 1.458 | 1.137 | 0.727 | 1.458 |
| −0.334 | 0.240 | 1.458 | −0.978 | 0.430 | 1.458 | 1.141 | 0.723 | 1.458 |
| −0.411 | 0.236 | 1.458 | −0.926 | 0.427 | 1.458 | 1.143 | 0.720 | 1.458 |
| −0.487 | 0.235 | 1.458 | −0.870 | 0.425 | 1.458 | 1.144 | 0.718 | 1.458 |
| −0.560 | 0.237 | 1.458 | −0.811 | 0.424 | 1.458 | 1.145 | 0.717 | 1.458 |
| −0.631 | 0.241 | 1.458 | −0.750 | 0.423 | 1.458 | 1.145 | 0.716 | 1.458 |
| −0.700 | 0.246 | 1.458 | −0.686 | 0.423 | 1.458 | | | |
| −0.765 | 0.254 | 1.458 | −0.620 | 0.424 | 1.458 | | | |
| 1.007 | 0.784 | 2.188 | −0.850 | 0.378 | 2.188 | −0.590 | 0.527 | 2.188 |
| 1.008 | 0.783 | 2.188 | −0.906 | 0.388 | 2.188 | −0.523 | 0.530 | 2.188 |
| 1.008 | 0.781 | 2.188 | −0.960 | 0.400 | 2.188 | −0.454 | 0.534 | 2.188 |
| 1.008 | 0.777 | 2.188 | −1.008 | 0.412 | 2.188 | −0.385 | 0.538 | 2.188 |
| 1.008 | 0.771 | 2.188 | −1.052 | 0.424 | 2.188 | −0.317 | 0.544 | 2.188 |
| 1.003 | 0.762 | 2.188 | −1.090 | 0.436 | 2.188 | −0.248 | 0.551 | 2.188 |
| 0.990 | 0.755 | 2.188 | −1.124 | 0.448 | 2.188 | −0.179 | 0.558 | 2.188 |
| 0.973 | 0.748 | 2.188 | −1.154 | 0.459 | 2.188 | −0.111 | 0.566 | 2.188 |
| 0.950 | 0.739 | 2.188 | −1.178 | 0.469 | 2.188 | −0.042 | 0.575 | 2.188 |
| 0.921 | 0.728 | 2.188 | −1.198 | 0.478 | 2.188 | 0.026 | 0.585 | 2.188 |
| 0.888 | 0.715 | 2.188 | −1.215 | 0.487 | 2.188 | 0.094 | 0.595 | 2.188 |
| 0.853 | 0.700 | 2.188 | −1.228 | 0.496 | 2.188 | 0.162 | 0.607 | 2.188 |
| 0.813 | 0.684 | 2.188 | −1.238 | 0.504 | 2.188 | 0.230 | 0.619 | 2.188 |
| 0.768 | 0.666 | 2.188 | −1.245 | 0.510 | 2.188 | 0.298 | 0.631 | 2.188 |
| 0.720 | 0.646 | 2.188 | −1.249 | 0.516 | 2.188 | 0.363 | 0.644 | 2.188 |
| 0.669 | 0.626 | 2.188 | −1.252 | 0.522 | 2.188 | 0.427 | 0.657 | 2.188 |
| 0.615 | 0.605 | 2.188 | −1.253 | 0.526 | 2.188 | 0.487 | 0.670 | 2.188 |
| 0.560 | 0.583 | 2.188 | −1.253 | 0.530 | 2.188 | 0.546 | 0.683 | 2.188 |
| 0.502 | 0.561 | 2.188 | −1.251 | 0.533 | 2.188 | 0.602 | 0.696 | 2.188 |
| 0.441 | 0.539 | 2.188 | −1.248 | 0.537 | 2.188 | 0.655 | 0.709 | 2.188 |
| 0.378 | 0.516 | 2.188 | −1.244 | 0.540 | 2.188 | 0.707 | 0.721 | 2.188 |
| 0.313 | 0.494 | 2.188 | −1.237 | 0.543 | 2.188 | 0.756 | 0.734 | 2.188 |
| 0.244 | 0.471 | 2.188 | −1.228 | 0.545 | 2.188 | 0.800 | 0.745 | 2.188 |
| 0.176 | 0.451 | 2.188 | −1.217 | 0.547 | 2.188 | 0.840 | 0.756 | 2.188 |
| 0.107 | 0.431 | 2.188 | −1.202 | 0.548 | 2.188 | 0.876 | 0.766 | 2.188 |
| 0.037 | 0.413 | 2.188 | −1.184 | 0.549 | 2.188 | 0.909 | 0.776 | 2.188 |
| −0.032 | 0.398 | 2.188 | −1.162 | 0.548 | 2.188 | 0.937 | 0.785 | 2.188 |
| −0.103 | 0.384 | 2.188 | −1.137 | 0.546 | 2.188 | 0.959 | 0.792 | 2.188 |
| −0.173 | 0.372 | 2.188 | −1.107 | 0.544 | 2.188 | 0.977 | 0.797 | 2.188 |
| −0.244 | 0.363 | 2.188 | −1.072 | 0.541 | 2.188 | 0.991 | 0.799 | 2.188 |
| −0.316 | 0.356 | 2.188 | −1.033 | 0.539 | 2.188 | 1.000 | 0.794 | 2.188 |
| −0.387 | 0.351 | 2.188 | −0.990 | 0.535 | 2.188 | 1.004 | 0.790 | 2.188 |
| −0.459 | 0.349 | 2.188 | −0.942 | 0.532 | 2.188 | 1.006 | 0.787 | 2.188 |
| −0.530 | 0.349 | 2.188 | −0.889 | 0.530 | 2.188 | 1.007 | 0.786 | 2.188 |
| −0.599 | 0.351 | 2.188 | −0.833 | 0.528 | 2.188 | 1.007 | 0.785 | 2.188 |
| −0.666 | 0.355 | 2.188 | −0.776 | 0.526 | 2.188 | 1.007 | 0.784 | 2.188 |
| −0.730 | 0.361 | 2.188 | −0.716 | 0.526 | 2.188 | | | |
| −0.792 | 0.369 | 2.188 | −0.654 | 0.526 | 2.188 | | | |
| 0.982 | 0.768 | 2.552 | −0.831 | 0.382 | 2.552 | −0.576 | 0.527 | 2.552 |
| 0.982 | 0.768 | 2.552 | −0.885 | 0.392 | 2.552 | −0.511 | 0.529 | 2.552 |
| 0.982 | 0.766 | 2.552 | −0.937 | 0.404 | 2.552 | −0.444 | 0.532 | 2.552 |
| 0.983 | 0.762 | 2.552 | −0.984 | 0.416 | 2.552 | −0.377 | 0.536 | 2.552 |
| 0.982 | 0.756 | 2.552 | −1.027 | 0.428 | 2.552 | −0.310 | 0.541 | 2.552 |
| 0.977 | 0.747 | 2.552 | −1.064 | 0.441 | 2.552 | −0.243 | 0.547 | 2.552 |
| 0.965 | 0.740 | 2.552 | −1.097 | 0.452 | 2.552 | −0.176 | 0.554 | 2.552 |
| 0.947 | 0.733 | 2.552 | −1.126 | 0.463 | 2.552 | −0.109 | 0.562 | 2.552 |
| 0.926 | 0.725 | 2.552 | −1.149 | 0.473 | 2.552 | −0.042 | 0.570 | 2.552 |
| 0.898 | 0.714 | 2.552 | −1.169 | 0.482 | 2.552 | 0.024 | 0.579 | 2.552 |
| 0.865 | 0.701 | 2.552 | −1.185 | 0.491 | 2.552 | 0.091 | 0.589 | 2.552 |
| 0.830 | 0.687 | 2.552 | −1.198 | 0.500 | 2.552 | 0.157 | 0.599 | 2.552 |
| 0.792 | 0.672 | 2.552 | −1.208 | 0.507 | 2.552 | 0.224 | 0.610 | 2.552 |
| 0.748 | 0.654 | 2.552 | −1.214 | 0.514 | 2.552 | 0.290 | 0.622 | 2.552 |
| 0.701 | 0.635 | 2.552 | −1.218 | 0.520 | 2.552 | 0.354 | 0.635 | 2.552 |
| 0.651 | 0.615 | 2.552 | −1.221 | 0.525 | 2.552 | 0.415 | 0.647 | 2.552 |
| 0.599 | 0.595 | 2.552 | −1.222 | 0.530 | 2.552 | 0.474 | 0.659 | 2.552 |
| 0.545 | 0.574 | 2.552 | −1.222 | 0.533 | 2.552 | 0.531 | 0.672 | 2.552 |
| 0.488 | 0.553 | 2.552 | −1.220 | 0.536 | 2.552 | 0.586 | 0.684 | 2.552 |
| 0.429 | 0.531 | 2.552 | −1.217 | 0.540 | 2.552 | 0.638 | 0.696 | 2.552 |
| 0.368 | 0.509 | 2.552 | −1.213 | 0.543 | 2.552 | 0.688 | 0.708 | 2.552 |
| 0.304 | 0.488 | 2.552 | −1.207 | 0.546 | 2.552 | 0.736 | 0.720 | 2.552 |
| 0.237 | 0.466 | 2.552 | −1.198 | 0.548 | 2.552 | 0.780 | 0.732 | 2.552 |
| 0.171 | 0.447 | 2.552 | −1.186 | 0.550 | 2.552 | 0.819 | 0.742 | 2.552 |
| 0.103 | 0.428 | 2.552 | −1.172 | 0.551 | 2.552 | 0.853 | 0.752 | 2.552 |
| 0.036 | 0.411 | 2.552 | −1.154 | 0.551 | 2.552 | 0.885 | 0.761 | 2.552 |
| −0.033 | 0.396 | 2.552 | −1.133 | 0.550 | 2.552 | 0.913 | 0.770 | 2.552 |
| −0.101 | 0.383 | 2.552 | −1.108 | 0.549 | 2.552 | 0.935 | 0.776 | 2.552 |

TABLE 11S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.170 | 0.372 | 2.552 | −1.079 | 0.546 | 2.552 | 0.952 | 0.782 | 2.552 |
| −0.240 | 0.364 | 2.552 | −1.046 | 0.543 | 2.552 | 0.965 | 0.783 | 2.552 |
| −0.309 | 0.357 | 2.552 | −1.008 | 0.540 | 2.552 | 0.974 | 0.779 | 2.552 |
| −0.379 | 0.353 | 2.552 | −0.965 | 0.537 | 2.552 | 0.978 | 0.775 | 2.552 |
| −0.449 | 0.351 | 2.552 | −0.918 | 0.534 | 2.552 | 0.980 | 0.772 | 2.552 |
| −0.519 | 0.352 | 2.552 | −0.867 | 0.531 | 2.552 | 0.981 | 0.770 | 2.552 |
| −0.586 | 0.354 | 2.552 | −0.813 | 0.528 | 2.552 | 0.981 | 0.769 | 2.552 |
| −0.651 | 0.358 | 2.552 | −0.757 | 0.527 | 2.552 | 0.981 | 0.769 | 2.552 |
| −0.714 | 0.365 | 2.552 | −0.699 | 0.526 | 2.552 | | | |
| −0.774 | 0.372 | 2.552 | −0.638 | 0.526 | 2.552 | | | |
| 0.977 | 0.727 | 2.917 | −0.792 | 0.357 | 2.917 | −0.542 | 0.498 | 2.917 |
| 0.977 | 0.726 | 2.917 | −0.845 | 0.367 | 2.917 | −0.479 | 0.500 | 2.917 |
| 0.978 | 0.724 | 2.917 | −0.896 | 0.379 | 2.917 | −0.413 | 0.502 | 2.917 |
| 0.978 | 0.721 | 2.917 | −0.941 | 0.391 | 2.917 | −0.348 | 0.506 | 2.917 |
| 0.977 | 0.715 | 2.917 | −0.983 | 0.404 | 2.917 | −0.283 | 0.511 | 2.917 |
| 0.972 | 0.706 | 2.917 | −1.019 | 0.416 | 2.917 | −0.217 | 0.516 | 2.917 |
| 0.960 | 0.699 | 2.917 | −1.051 | 0.428 | 2.917 | −0.152 | 0.522 | 2.917 |
| 0.943 | 0.693 | 2.917 | −1.079 | 0.438 | 2.917 | −0.087 | 0.530 | 2.917 |
| 0.922 | 0.684 | 2.917 | −1.102 | 0.448 | 2.917 | −0.022 | 0.537 | 2.917 |
| 0.895 | 0.674 | 2.917 | −1.121 | 0.458 | 2.917 | 0.043 | 0.546 | 2.917 |
| 0.863 | 0.661 | 2.917 | −1.137 | 0.467 | 2.917 | 0.108 | 0.555 | 2.917 |
| 0.829 | 0.648 | 2.917 | −1.149 | 0.475 | 2.917 | 0.173 | 0.565 | 2.917 |
| 0.791 | 0.632 | 2.917 | −1.159 | 0.482 | 2.917 | 0.237 | 0.575 | 2.917 |
| 0.749 | 0.615 | 2.917 | −1.165 | 0.489 | 2.917 | 0.302 | 0.587 | 2.917 |
| 0.703 | 0.597 | 2.917 | −1.169 | 0.495 | 2.917 | 0.364 | 0.598 | 2.917 |
| 0.654 | 0.577 | 2.917 | −1.171 | 0.500 | 2.917 | 0.424 | 0.610 | 2.917 |
| 0.603 | 0.558 | 2.917 | −1.172 | 0.504 | 2.917 | 0.482 | 0.622 | 2.917 |
| 0.550 | 0.537 | 2.917 | −1.172 | 0.508 | 2.917 | 0.538 | 0.634 | 2.917 |
| 0.495 | 0.516 | 2.917 | −1.171 | 0.511 | 2.917 | 0.591 | 0.646 | 2.917 |
| 0.437 | 0.495 | 2.917 | −1.168 | 0.514 | 2.917 | 0.642 | 0.657 | 2.917 |
| 0.377 | 0.474 | 2.917 | −1.163 | 0.517 | 2.917 | 0.691 | 0.669 | 2.917 |
| 0.315 | 0.453 | 2.917 | −1.157 | 0.520 | 2.917 | 0.738 | 0.681 | 2.917 |
| 0.250 | 0.433 | 2.917 | −1.149 | 0.522 | 2.917 | 0.780 | 0.692 | 2.917 |
| 0.185 | 0.414 | 2.917 | −1.138 | 0.524 | 2.917 | 0.818 | 0.702 | 2.917 |
| 0.119 | 0.396 | 2.917 | −1.123 | 0.525 | 2.917 | 0.852 | 0.711 | 2.917 |
| 0.053 | 0.380 | 2.917 | −1.106 | 0.525 | 2.917 | 0.883 | 0.720 | 2.917 |
| −0.014 | 0.366 | 2.917 | −1.086 | 0.524 | 2.917 | 0.910 | 0.728 | 2.917 |
| −0.081 | 0.353 | 2.917 | −1.062 | 0.523 | 2.917 | 0.931 | 0.735 | 2.917 |
| −0.148 | 0.343 | 2.917 | −1.033 | 0.520 | 2.917 | 0.948 | 0.740 | 2.917 |
| −0.216 | 0.335 | 2.917 | −1.001 | 0.517 | 2.917 | 0.961 | 0.741 | 2.917 |
| −0.283 | 0.329 | 2.917 | −0.964 | 0.514 | 2.917 | 0.970 | 0.737 | 2.917 |
| −0.352 | 0.326 | 2.917 | −0.922 | 0.510 | 2.917 | 0.974 | 0.733 | 2.917 |
| −0.420 | 0.324 | 2.917 | −0.876 | 0.507 | 2.917 | 0.975 | 0.730 | 2.917 |
| −0.488 | 0.325 | 2.917 | −0.826 | 0.504 | 2.917 | 0.976 | 0.729 | 2.917 |
| −0.554 | 0.328 | 2.917 | −0.774 | 0.501 | 2.917 | 0.977 | 0.728 | 2.917 |
| −0.617 | 0.333 | 2.917 | −0.719 | 0.499 | 2.917 | 0.977 | 0.727 | 2.917 |
| −0.678 | 0.339 | 2.917 | −0.662 | 0.498 | 2.917 | | | |
| −0.736 | 0.347 | 2.917 | −0.603 | 0.498 | 2.917 | | | |
| 0.997 | 0.665 | 3.282 | −0.740 | 0.307 | 3.282 | −0.494 | 0.446 | 3.282 |
| 0.997 | 0.664 | 3.282 | −0.792 | 0.318 | 3.282 | −0.432 | 0.447 | 3.282 |
| 0.998 | 0.662 | 3.282 | −0.842 | 0.330 | 3.282 | −0.368 | 0.449 | 3.282 |
| 0.998 | 0.658 | 3.282 | −0.887 | 0.343 | 3.282 | −0.303 | 0.453 | 3.282 |
| 0.997 | 0.653 | 3.282 | −0.927 | 0.355 | 3.282 | −0.239 | 0.457 | 3.282 |
| 0.992 | 0.644 | 3.282 | −0.963 | 0.367 | 3.282 | −0.175 | 0.462 | 3.282 |
| 0.981 | 0.637 | 3.282 | −0.995 | 0.379 | 3.282 | −0.111 | 0.468 | 3.282 |
| 0.964 | 0.631 | 3.282 | −1.022 | 0.390 | 3.282 | −0.047 | 0.474 | 3.282 |
| 0.944 | 0.623 | 3.282 | −1.044 | 0.400 | 3.282 | 0.017 | 0.482 | 3.282 |
| 0.916 | 0.612 | 3.282 | −1.063 | 0.409 | 3.282 | 0.080 | 0.490 | 3.282 |
| 0.885 | 0.600 | 3.282 | −1.078 | 0.418 | 3.282 | 0.144 | 0.499 | 3.282 |
| 0.852 | 0.587 | 3.282 | −1.091 | 0.426 | 3.282 | 0.208 | 0.508 | 3.282 |
| 0.815 | 0.572 | 3.282 | −1.099 | 0.434 | 3.282 | 0.271 | 0.518 | 3.282 |
| 0.774 | 0.555 | 3.282 | −1.106 | 0.440 | 3.282 | 0.334 | 0.529 | 3.282 |
| 0.728 | 0.536 | 3.282 | −1.110 | 0.446 | 3.282 | 0.396 | 0.540 | 3.282 |
| 0.680 | 0.517 | 3.282 | −1.112 | 0.451 | 3.282 | 0.455 | 0.551 | 3.282 |
| 0.630 | 0.498 | 3.282 | −1.113 | 0.455 | 3.282 | 0.511 | 0.563 | 3.282 |
| 0.578 | 0.478 | 3.282 | −1.112 | 0.459 | 3.282 | 0.566 | 0.574 | 3.282 |
| 0.524 | 0.457 | 3.282 | −1.111 | 0.462 | 3.282 | 0.618 | 0.586 | 3.282 |
| 0.467 | 0.437 | 3.282 | −1.108 | 0.465 | 3.282 | 0.668 | 0.597 | 3.282 |
| 0.408 | 0.416 | 3.282 | −1.104 | 0.468 | 3.282 | 0.716 | 0.609 | 3.282 |
| 0.347 | 0.396 | 3.282 | −1.098 | 0.471 | 3.282 | 0.762 | 0.620 | 3.282 |
| 0.283 | 0.376 | 3.282 | −1.090 | 0.473 | 3.282 | 0.804 | 0.630 | 3.282 |
| 0.219 | 0.357 | 3.282 | −1.079 | 0.475 | 3.282 | 0.841 | 0.640 | 3.282 |
| 0.154 | 0.340 | 3.282 | −1.065 | 0.476 | 3.282 | 0.874 | 0.649 | 3.282 |
| 0.089 | 0.324 | 3.282 | −1.048 | 0.476 | 3.282 | 0.905 | 0.658 | 3.282 |
| 0.024 | 0.310 | 3.282 | −1.028 | 0.475 | 3.282 | 0.932 | 0.666 | 3.282 |
| −0.042 | 0.298 | 3.282 | −1.004 | 0.473 | 3.282 | 0.952 | 0.673 | 3.282 |
| −0.108 | 0.289 | 3.282 | −0.976 | 0.471 | 3.282 | 0.969 | 0.678 | 3.282 |

TABLE 11S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.175 | 0.281 | 3.282 | −0.944 | 0.468 | 3.282 | 0.981 | 0.679 | 3.282 |
| −0.241 | 0.276 | 3.282 | −0.908 | 0.464 | 3.282 | 0.990 | 0.675 | 3.282 |
| −0.308 | 0.273 | 3.282 | −0.867 | 0.461 | 3.282 | 0.994 | 0.671 | 3.282 |
| −0.375 | 0.272 | 3.282 | −0.822 | 0.457 | 3.282 | 0.996 | 0.668 | 3.282 |
| −0.442 | 0.273 | 3.282 | −0.773 | 0.454 | 3.282 | 0.996 | 0.666 | 3.282 |
| −0.507 | 0.276 | 3.282 | −0.722 | 0.451 | 3.282 | 0.997 | 0.666 | 3.282 |
| −0.569 | 0.282 | 3.282 | −0.668 | 0.448 | 3.282 | 0.997 | 0.665 | 3.282 |
| −0.629 | 0.289 | 3.282 | −0.612 | 0.447 | 3.282 | | | |
| −0.686 | 0.297 | 3.282 | −0.554 | 0.446 | 3.282 | | | |
| 1.156 | 0.412 | 4.375 | −0.566 | 0.096 | 4.375 | −0.320 | 0.225 | 4.375 |
| 1.156 | 0.411 | 4.375 | −0.617 | 0.109 | 4.375 | −0.259 | 0.225 | 4.375 |
| 1.157 | 0.409 | 4.375 | −0.666 | 0.122 | 4.375 | −0.195 | 0.225 | 4.375 |
| 1.157 | 0.406 | 4.375 | −0.710 | 0.136 | 4.375 | −0.132 | 0.227 | 4.375 |
| 1.156 | 0.400 | 4.375 | −0.750 | 0.149 | 4.375 | −0.068 | 0.229 | 4.375 |
| 1.151 | 0.392 | 4.375 | −0.785 | 0.162 | 4.375 | −0.005 | 0.233 | 4.375 |
| 1.140 | 0.385 | 4.375 | −0.815 | 0.174 | 4.375 | 0.059 | 0.237 | 4.375 |
| 1.123 | 0.379 | 4.375 | −0.842 | 0.186 | 4.375 | 0.122 | 0.242 | 4.375 |
| 1.103 | 0.371 | 4.375 | −0.864 | 0.196 | 4.375 | 0.185 | 0.248 | 4.375 |
| 1.076 | 0.361 | 4.375 | −0.882 | 0.206 | 4.375 | 0.248 | 0.255 | 4.375 |
| 1.045 | 0.349 | 4.375 | −0.897 | 0.215 | 4.375 | 0.311 | 0.262 | 4.375 |
| 1.012 | 0.337 | 4.375 | −0.909 | 0.223 | 4.375 | 0.374 | 0.270 | 4.375 |
| 0.975 | 0.322 | 4.375 | −0.918 | 0.231 | 4.375 | 0.437 | 0.279 | 4.375 |
| 0.934 | 0.307 | 4.375 | −0.924 | 0.237 | 4.375 | 0.499 | 0.288 | 4.375 |
| 0.889 | 0.289 | 4.375 | −0.927 | 0.243 | 4.375 | 0.560 | 0.298 | 4.375 |
| 0.841 | 0.271 | 4.375 | −0.930 | 0.248 | 4.375 | 0.618 | 0.308 | 4.375 |
| 0.792 | 0.253 | 4.375 | −0.930 | 0.253 | 4.375 | 0.675 | 0.318 | 4.375 |
| 0.740 | 0.234 | 4.375 | −0.930 | 0.256 | 4.375 | 0.729 | 0.329 | 4.375 |
| 0.686 | 0.215 | 4.375 | −0.928 | 0.259 | 4.375 | 0.781 | 0.339 | 4.375 |
| 0.629 | 0.196 | 4.375 | −0.925 | 0.262 | 4.375 | 0.830 | 0.350 | 4.375 |
| 0.571 | 0.177 | 4.375 | −0.921 | 0.265 | 4.375 | 0.878 | 0.360 | 4.375 |
| 0.510 | 0.158 | 4.375 | −0.915 | 0.267 | 4.375 | 0.923 | 0.370 | 4.375 |
| 0.446 | 0.139 | 4.375 | −0.907 | 0.269 | 4.375 | 0.965 | 0.380 | 4.375 |
| 0.383 | 0.122 | 4.375 | −0.896 | 0.270 | 4.375 | 1.002 | 0.389 | 4.375 |
| 0.318 | 0.107 | 4.375 | −0.882 | 0.271 | 4.375 | 1.034 | 0.398 | 4.375 |
| 0.254 | 0.093 | 4.375 | −0.865 | 0.271 | 4.375 | 1.065 | 0.406 | 4.375 |
| 0.189 | 0.080 | 4.375 | −0.846 | 0.269 | 4.375 | 1.091 | 0.414 | 4.375 |
| 0.124 | 0.070 | 4.375 | −0.822 | 0.267 | 4.375 | 1.112 | 0.420 | 4.375 |
| 0.058 | 0.062 | 4.375 | −0.795 | 0.263 | 4.375 | 1.128 | 0.425 | 4.375 |
| −0.008 | 0.056 | 4.375 | −0.763 | 0.259 | 4.375 | 1.141 | 0.426 | 4.375 |
| −0.074 | 0.052 | 4.375 | −0.728 | 0.255 | 4.375 | 1.149 | 0.422 | 4.375 |
| −0.140 | 0.051 | 4.375 | −0.688 | 0.250 | 4.375 | 1.153 | 0.418 | 4.375 |
| −0.206 | 0.052 | 4.375 | −0.643 | 0.245 | 4.375 | 1.155 | 0.415 | 4.375 |
| −0.272 | 0.055 | 4.375 | −0.595 | 0.241 | 4.375 | 1.155 | 0.413 | 4.375 |
| −0.336 | 0.060 | 4.375 | −0.544 | 0.236 | 4.375 | 1.156 | 0.413 | 4.375 |
| −0.398 | 0.067 | 4.375 | −0.491 | 0.232 | 4.375 | 1.156 | 0.412 | 4.375 |
| −0.456 | 0.075 | 4.375 | −0.436 | 0.229 | 4.375 | | | |
| −0.513 | 0.085 | 4.375 | −0.379 | 0.227 | 4.375 | | | |
| 1.219 | 0.315 | 4.740 | −0.511 | 0.029 | 4.740 | −0.263 | 0.146 | 4.740 |
| 1.219 | 0.314 | 4.740 | −0.562 | 0.042 | 4.740 | −0.201 | 0.144 | 4.740 |
| 1.219 | 0.313 | 4.740 | −0.610 | 0.056 | 4.740 | −0.138 | 0.143 | 4.740 |
| 1.219 | 0.309 | 4.740 | −0.654 | 0.071 | 4.740 | −0.074 | 0.143 | 4.740 |
| 1.219 | 0.304 | 4.740 | −0.694 | 0.085 | 4.740 | −0.010 | 0.145 | 4.740 |
| 1.214 | 0.295 | 4.740 | −0.728 | 0.098 | 4.740 | 0.053 | 0.147 | 4.740 |
| 1.202 | 0.289 | 4.740 | −0.759 | 0.111 | 4.740 | 0.117 | 0.151 | 4.740 |
| 1.185 | 0.283 | 4.740 | −0.785 | 0.123 | 4.740 | 0.180 | 0.155 | 4.740 |
| 1.165 | 0.275 | 4.740 | −0.807 | 0.133 | 4.740 | 0.244 | 0.160 | 4.740 |
| 1.138 | 0.265 | 4.740 | −0.825 | 0.143 | 4.740 | 0.307 | 0.166 | 4.740 |
| 1.107 | 0.254 | 4.740 | −0.840 | 0.153 | 4.740 | 0.370 | 0.173 | 4.740 |
| 1.073 | 0.241 | 4.740 | −0.852 | 0.161 | 4.740 | 0.434 | 0.180 | 4.740 |
| 1.036 | 0.227 | 4.740 | −0.861 | 0.169 | 4.740 | 0.497 | 0.188 | 4.740 |
| 0.995 | 0.212 | 4.740 | −0.867 | 0.176 | 4.740 | 0.560 | 0.197 | 4.740 |
| 0.949 | 0.195 | 4.740 | −0.870 | 0.181 | 4.740 | 0.621 | 0.206 | 4.740 |
| 0.902 | 0.178 | 4.740 | −0.873 | 0.186 | 4.740 | 0.679 | 0.215 | 4.740 |
| 0.852 | 0.160 | 4.740 | −0.873 | 0.191 | 4.740 | 0.736 | 0.225 | 4.740 |
| 0.799 | 0.142 | 4.740 | −0.873 | 0.194 | 4.740 | 0.790 | 0.234 | 4.740 |
| 0.745 | 0.124 | 4.740 | −0.871 | 0.197 | 4.740 | 0.842 | 0.244 | 4.740 |
| 0.688 | 0.106 | 4.740 | −0.868 | 0.200 | 4.740 | 0.892 | 0.254 | 4.740 |
| 0.629 | 0.088 | 4.740 | −0.863 | 0.202 | 4.740 | 0.940 | 0.265 | 4.740 |
| 0.567 | 0.070 | 4.740 | −0.857 | 0.204 | 4.740 | 0.985 | 0.275 | 4.740 |
| 0.503 | 0.053 | 4.740 | −0.849 | 0.206 | 4.740 | 1.027 | 0.284 | 4.740 |
| 0.439 | 0.037 | 4.740 | −0.838 | 0.207 | 4.740 | 1.064 | 0.293 | 4.740 |
| 0.375 | 0.023 | 4.740 | −0.824 | 0.207 | 4.740 | 1.097 | 0.302 | 4.740 |
| 0.310 | 0.010 | 4.740 | −0.808 | 0.206 | 4.740 | 1.127 | 0.310 | 4.740 |
| 0.244 | −0.001 | 4.740 | −0.788 | 0.204 | 4.740 | 1.154 | 0.317 | 4.740 |
| 0.179 | −0.010 | 4.740 | −0.765 | 0.200 | 4.740 | 1.174 | 0.323 | 4.740 |
| 0.113 | −0.017 | 4.740 | −0.737 | 0.196 | 4.740 | 1.191 | 0.328 | 4.740 |
| 0.047 | −0.022 | 4.740 | −0.706 | 0.191 | 4.740 | 1.203 | 0.329 | 4.740 |

TABLE 11S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.019 | −0.025 | 4.740 | −0.670 | 0.186 | 4.740 | 1.212 | 0.325 | 4.740 |
| −0.085 | −0.025 | 4.740 | −0.630 | 0.180 | 4.740 | 1.216 | 0.321 | 4.740 |
| −0.151 | −0.023 | 4.740 | −0.586 | 0.174 | 4.740 | 1.217 | 0.319 | 4.740 |
| −0.217 | −0.019 | 4.740 | −0.538 | 0.168 | 4.740 | 1.218 | 0.317 | 4.740 |
| −0.281 | −0.012 | 4.740 | −0.487 | 0.162 | 4.740 | 1.218 | 0.316 | 4.740 |
| −0.342 | −0.004 | 4.740 | −0.434 | 0.157 | 4.740 | 1.218 | 0.316 | 4.740 |
| −0.401 | 0.006 | 4.740 | −0.379 | 0.152 | 4.740 | | | |
| −0.457 | 0.017 | 4.740 | −0.322 | 0.149 | 4.740 | | | |
| 1.331 | 0.098 | 5.469 | −0.435 | −0.030 | 5.469 | −0.177 | 0.021 | 5.469 |
| 1.331 | 0.097 | 5.469 | −0.485 | −0.009 | 5.469 | −0.115 | 0.010 | 5.469 |
| 1.331 | 0.096 | 5.469 | −0.532 | 0.013 | 5.469 | −0.051 | 0.000 | 5.469 |
| 1.332 | 0.092 | 5.469 | −0.574 | 0.035 | 5.469 | 0.014 | −0.008 | 5.469 |
| 1.331 | 0.086 | 5.469 | −0.611 | 0.055 | 5.469 | 0.078 | −0.014 | 5.469 |
| 1.325 | 0.078 | 5.469 | −0.645 | 0.074 | 5.469 | 0.142 | −0.019 | 5.469 |
| 1.313 | 0.072 | 5.469 | −0.674 | 0.091 | 5.469 | 0.206 | −0.022 | 5.469 |
| 1.296 | 0.065 | 5.469 | −0.698 | 0.107 | 5.469 | 0.271 | −0.024 | 5.469 |
| 1.275 | 0.058 | 5.469 | −0.719 | 0.121 | 5.469 | 0.335 | −0.025 | 5.469 |
| 1.247 | 0.048 | 5.469 | −0.736 | 0.133 | 5.469 | 0.399 | −0.025 | 5.469 |
| 1.215 | 0.037 | 5.469 | −0.750 | 0.144 | 5.469 | 0.464 | −0.023 | 5.469 |
| 1.181 | 0.025 | 5.469 | −0.761 | 0.154 | 5.469 | 0.528 | −0.020 | 5.469 |
| 1.143 | 0.011 | 5.469 | −0.769 | 0.163 | 5.469 | 0.593 | −0.016 | 5.469 |
| 1.100 | −0.003 | 5.469 | −0.775 | 0.170 | 5.469 | 0.657 | −0.011 | 5.469 |
| 1.053 | −0.019 | 5.469 | −0.778 | 0.176 | 5.469 | 0.719 | −0.004 | 5.469 |
| 1.003 | −0.035 | 5.469 | −0.781 | 0.181 | 5.469 | 0.780 | 0.003 | 5.469 |
| 0.952 | −0.051 | 5.469 | −0.781 | 0.186 | 5.469 | 0.837 | 0.011 | 5.469 |
| 0.898 | −0.067 | 5.469 | −0.780 | 0.189 | 5.469 | 0.893 | 0.019 | 5.469 |
| 0.841 | −0.083 | 5.469 | −0.778 | 0.191 | 5.469 | 0.946 | 0.028 | 5.469 |
| 0.782 | −0.098 | 5.469 | −0.774 | 0.193 | 5.469 | 0.997 | 0.038 | 5.469 |
| 0.720 | −0.113 | 5.469 | −0.769 | 0.195 | 5.469 | 1.046 | 0.047 | 5.469 |
| 0.656 | −0.126 | 5.469 | −0.762 | 0.195 | 5.469 | 1.093 | 0.057 | 5.469 |
| 0.590 | −0.138 | 5.469 | −0.754 | 0.194 | 5.469 | 1.135 | 0.066 | 5.469 |
| 0.523 | −0.148 | 5.469 | −0.743 | 0.192 | 5.469 | 1.173 | 0.075 | 5.469 |
| 0.456 | −0.157 | 5.469 | −0.729 | 0.189 | 5.469 | 1.206 | 0.084 | 5.469 |
| 0.388 | −0.163 | 5.469 | −0.712 | 0.184 | 5.469 | 1.238 | 0.092 | 5.469 |
| 0.321 | −0.166 | 5.469 | −0.693 | 0.177 | 5.469 | 1.265 | 0.100 | 5.469 |
| 0.253 | −0.168 | 5.469 | −0.671 | 0.169 | 5.469 | 1.286 | 0.106 | 5.469 |
| 0.185 | −0.166 | 5.469 | −0.644 | 0.159 | 5.469 | 1.302 | 0.111 | 5.469 |
| 0.118 | −0.163 | 5.469 | −0.614 | 0.147 | 5.469 | 1.315 | 0.112 | 5.469 |
| 0.051 | −0.157 | 5.469 | −0.579 | 0.135 | 5.469 | 1.324 | 0.108 | 5.469 |
| −0.016 | −0.148 | 5.469 | −0.540 | 0.121 | 5.469 | 1.328 | 0.105 | 5.469 |
| −0.082 | −0.137 | 5.469 | −0.497 | 0.106 | 5.469 | 1.330 | 0.102 | 5.469 |
| −0.147 | −0.123 | 5.469 | −0.450 | 0.091 | 5.469 | 1.330 | 0.100 | 5.469 |
| −0.210 | −0.107 | 5.469 | −0.400 | 0.076 | 5.469 | 1.331 | 0.099 | 5.469 |
| −0.270 | −0.090 | 5.469 | −0.348 | 0.061 | 5.469 | 1.331 | 0.099 | 5.469 |
| −0.328 | −0.071 | 5.469 | −0.293 | 0.047 | 5.469 | | | |
| −0.383 | −0.051 | 5.469 | −0.236 | 0.034 | 5.469 | | | |
| 1.392 | −0.036 | 5.834 | −0.408 | −0.035 | 5.834 | −0.146 | −0.030 | 5.834 |
| 1.392 | −0.037 | 5.834 | −0.456 | −0.007 | 5.834 | −0.084 | −0.049 | 5.834 |
| 1.392 | −0.039 | 5.834 | −0.501 | 0.021 | 5.834 | −0.020 | −0.067 | 5.834 |
| 1.393 | −0.043 | 5.834 | −0.541 | 0.048 | 5.834 | 0.045 | −0.082 | 5.834 |
| 1.392 | −0.048 | 5.834 | −0.577 | 0.073 | 5.834 | 0.110 | −0.095 | 5.834 |
| 1.386 | −0.057 | 5.834 | −0.609 | 0.096 | 5.834 | 0.175 | −0.105 | 5.834 |
| 1.373 | −0.063 | 5.834 | −0.636 | 0.118 | 5.834 | 0.240 | −0.114 | 5.834 |
| 1.356 | −0.069 | 5.834 | −0.659 | 0.137 | 5.834 | 0.305 | −0.121 | 5.834 |
| 1.334 | −0.076 | 5.834 | −0.678 | 0.154 | 5.834 | 0.371 | −0.126 | 5.834 |
| 1.305 | −0.085 | 5.834 | −0.694 | 0.169 | 5.834 | 0.436 | −0.129 | 5.834 |
| 1.272 | −0.096 | 5.834 | −0.707 | 0.182 | 5.834 | 0.502 | −0.131 | 5.834 |
| 1.237 | −0.108 | 5.834 | −0.717 | 0.193 | 5.834 | 0.568 | −0.132 | 5.834 |
| 1.197 | −0.120 | 5.834 | −0.724 | 0.203 | 5.834 | 0.634 | −0.131 | 5.834 |
| 1.153 | −0.134 | 5.834 | −0.729 | 0.211 | 5.834 | 0.700 | −0.128 | 5.834 |
| 1.104 | −0.148 | 5.834 | −0.732 | 0.217 | 5.834 | 0.764 | −0.125 | 5.834 |
| 1.053 | −0.163 | 5.834 | −0.734 | 0.223 | 5.834 | 0.826 | −0.120 | 5.834 |
| 0.999 | −0.177 | 5.834 | −0.734 | 0.227 | 5.834 | 0.885 | −0.114 | 5.834 |
| 0.943 | −0.191 | 5.834 | −0.733 | 0.230 | 5.834 | 0.942 | −0.107 | 5.834 |
| 0.884 | −0.205 | 5.834 | −0.730 | 0.232 | 5.834 | 0.997 | −0.099 | 5.834 |
| 0.823 | −0.218 | 5.834 | −0.726 | 0.233 | 5.834 | 1.049 | −0.091 | 5.834 |
| 0.759 | −0.229 | 5.834 | −0.720 | 0.233 | 5.834 | 1.099 | −0.083 | 5.834 |
| 0.693 | −0.239 | 5.834 | −0.714 | 0.231 | 5.834 | 1.147 | −0.074 | 5.834 |
| 0.624 | −0.248 | 5.834 | −0.705 | 0.228 | 5.834 | 1.191 | −0.065 | 5.834 |
| 0.554 | −0.254 | 5.834 | −0.695 | 0.224 | 5.834 | 1.230 | −0.057 | 5.834 |
| 0.485 | −0.257 | 5.834 | −0.682 | 0.218 | 5.834 | 1.264 | −0.050 | 5.834 |
| 0.416 | −0.258 | 5.834 | −0.666 | 0.209 | 5.834 | 1.296 | −0.042 | 5.834 |
| 0.346 | −0.257 | 5.834 | −0.648 | 0.199 | 5.834 | 1.324 | −0.034 | 5.834 |
| 0.277 | −0.252 | 5.834 | −0.627 | 0.187 | 5.834 | 1.345 | −0.029 | 5.834 |
| 0.208 | −0.245 | 5.834 | −0.602 | 0.172 | 5.834 | 1.363 | −0.024 | 5.834 |
| 0.139 | −0.235 | 5.834 | −0.573 | 0.156 | 5.834 | 1.376 | −0.022 | 5.834 |
| 0.071 | −0.221 | 5.834 | −0.540 | 0.138 | 5.834 | 1.385 | −0.026 | 5.834 |

TABLE 11S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.004 | −0.205 | 5.834 | −0.502 | 0.118 | 5.834 | 1.389 | −0.030 | 5.834 |
| −0.063 | −0.186 | 5.834 | −0.460 | 0.097 | 5.834 | 1.391 | −0.033 | 5.834 |
| −0.128 | −0.164 | 5.834 | −0.414 | 0.075 | 5.834 | 1.391 | −0.035 | 5.834 |
| −0.190 | −0.140 | 5.834 | −0.366 | 0.053 | 5.834 | 1.392 | −0.036 | 5.834 |
| −0.249 | −0.115 | 5.834 | −0.314 | 0.031 | 5.834 | 1.392 | −0.036 | 5.834 |
| −0.305 | −0.089 | 5.834 | −0.261 | 0.010 | 5.834 | | | |
| −0.358 | −0.063 | 5.834 | −0.204 | −0.010 | 5.834 | | | |

The coordinate values given in TABLE 12S below provide the nominal profile envelope for an exemplary twelfth stage stator.

TABLE 12S

| X-LOC | Y-LOC | Z-LOC | X-LOC | Y-LOC | Z-LOC | X-LOC | Y-LOC | Z-LOC |
|---|---|---|---|---|---|---|---|---|
| 1.650 | 0.172 | 0.000 | −0.799 | −0.084 | 0.000 | −0.426 | 0.010 | 0.000 |
| 1.651 | 0.171 | 0.000 | −0.867 | −0.051 | 0.000 | −0.340 | −0.005 | 0.000 |
| 1.651 | 0.168 | 0.000 | −0.931 | −0.018 | 0.000 | −0.251 | −0.018 | 0.000 |
| 1.651 | 0.163 | 0.000 | −0.988 | 0.013 | 0.000 | −0.162 | −0.028 | 0.000 |
| 1.648 | 0.156 | 0.000 | −1.040 | 0.043 | 0.000 | −0.073 | −0.035 | 0.000 |
| 1.637 | 0.148 | 0.000 | −1.085 | 0.072 | 0.000 | 0.015 | −0.040 | 0.000 |
| 1.620 | 0.140 | 0.000 | −1.124 | 0.098 | 0.000 | 0.104 | −0.042 | 0.000 |
| 1.597 | 0.129 | 0.000 | −1.157 | 0.122 | 0.000 | 0.192 | −0.041 | 0.000 |
| 1.568 | 0.116 | 0.000 | −1.185 | 0.143 | 0.000 | 0.281 | −0.039 | 0.000 |
| 1.531 | 0.099 | 0.000 | −1.208 | 0.161 | 0.000 | 0.369 | −0.035 | 0.000 |
| 1.488 | 0.080 | 0.000 | −1.227 | 0.177 | 0.000 | 0.457 | −0.029 | 0.000 |
| 1.441 | 0.060 | 0.000 | −1.242 | 0.192 | 0.000 | 0.546 | −0.022 | 0.000 |
| 1.389 | 0.039 | 0.000 | −1.253 | 0.204 | 0.000 | 0.634 | −0.013 | 0.000 |
| 1.330 | 0.015 | 0.000 | −1.260 | 0.214 | 0.000 | 0.722 | −0.003 | 0.000 |
| 1.265 | −0.010 | 0.000 | −1.265 | 0.222 | 0.000 | 0.807 | 0.008 | 0.000 |
| 1.197 | −0.035 | 0.000 | −1.268 | 0.230 | 0.000 | 0.889 | 0.019 | 0.000 |
| 1.126 | −0.060 | 0.000 | −1.268 | 0.236 | 0.000 | 0.969 | 0.031 | 0.000 |
| 1.051 | −0.084 | 0.000 | −1.267 | 0.241 | 0.000 | 1.045 | 0.044 | 0.000 |
| 0.973 | −0.109 | 0.000 | −1.264 | 0.244 | 0.000 | 1.118 | 0.057 | 0.000 |
| 0.892 | −0.133 | 0.000 | −1.258 | 0.247 | 0.000 | 1.189 | 0.071 | 0.000 |
| 0.807 | −0.157 | 0.000 | −1.251 | 0.248 | 0.000 | 1.256 | 0.085 | 0.000 |
| 0.718 | −0.180 | 0.000 | −1.242 | 0.249 | 0.000 | 1.320 | 0.099 | 0.000 |
| 0.627 | −0.201 | 0.000 | −1.230 | 0.247 | 0.000 | 1.378 | 0.113 | 0.000 |
| 0.534 | −0.221 | 0.000 | −1.215 | 0.244 | 0.000 | 1.430 | 0.127 | 0.000 |
| 0.442 | −0.237 | 0.000 | −1.196 | 0.239 | 0.000 | 1.476 | 0.139 | 0.000 |
| 0.348 | −0.251 | 0.000 | −1.173 | 0.232 | 0.000 | 1.519 | 0.151 | 0.000 |
| 0.254 | −0.262 | 0.000 | −1.146 | 0.223 | 0.000 | 1.556 | 0.162 | 0.000 |
| 0.160 | −0.269 | 0.000 | −1.115 | 0.212 | 0.000 | 1.585 | 0.170 | 0.000 |
| 0.065 | −0.272 | 0.000 | −1.078 | 0.199 | 0.000 | 1.608 | 0.177 | 0.000 |
| −0.029 | −0.271 | 0.000 | −1.035 | 0.183 | 0.000 | 1.625 | 0.182 | 0.000 |
| −0.123 | −0.266 | 0.000 | −0.987 | 0.166 | 0.000 | 1.638 | 0.183 | 0.000 |
| −0.217 | −0.255 | 0.000 | −0.932 | 0.147 | 0.000 | 1.645 | 0.180 | 0.000 |
| −0.309 | −0.241 | 0.000 | −0.872 | 0.127 | 0.000 | 1.648 | 0.176 | 0.000 |
| −0.400 | −0.221 | 0.000 | −0.806 | 0.106 | 0.000 | 1.649 | 0.174 | 0.000 |
| −0.487 | −0.199 | 0.000 | −0.736 | 0.085 | 0.000 | 1.650 | 0.173 | 0.000 |
| −0.571 | −0.173 | 0.000 | −0.664 | 0.065 | 0.000 | 1.650 | 0.172 | 0.000 |
| −0.650 | −0.145 | 0.000 | −0.588 | 0.046 | 0.000 | | | |
| −0.726 | −0.115 | 0.000 | −0.508 | 0.027 | 0.000 | | | |
| 1.417 | 0.393 | 0.539 | −0.674 | −0.043 | 0.539 | −0.379 | 0.116 | 0.539 |
| 1.417 | 0.392 | 0.539 | −0.736 | −0.030 | 0.539 | −0.304 | 0.117 | 0.539 |
| 1.418 | 0.390 | 0.539 | −0.796 | −0.016 | 0.539 | −0.227 | 0.118 | 0.539 |
| 1.418 | 0.385 | 0.539 | −0.850 | −0.002 | 0.539 | −0.149 | 0.121 | 0.539 |
| 1.416 | 0.379 | 0.539 | −0.899 | 0.013 | 0.539 | −0.072 | 0.125 | 0.539 |
| 1.408 | 0.370 | 0.539 | −0.942 | 0.027 | 0.539 | 0.005 | 0.130 | 0.539 |
| 1.394 | 0.363 | 0.539 | −0.980 | 0.041 | 0.539 | 0.083 | 0.136 | 0.539 |
| 1.374 | 0.353 | 0.539 | −1.012 | 0.054 | 0.539 | 0.160 | 0.143 | 0.539 |
| 1.350 | 0.342 | 0.539 | −1.040 | 0.065 | 0.539 | 0.237 | 0.151 | 0.539 |
| 1.319 | 0.327 | 0.539 | −1.062 | 0.076 | 0.539 | 0.314 | 0.161 | 0.539 |
| 1.282 | 0.309 | 0.539 | −1.081 | 0.086 | 0.539 | 0.391 | 0.171 | 0.539 |
| 1.243 | 0.292 | 0.539 | −1.096 | 0.096 | 0.539 | 0.467 | 0.182 | 0.539 |
| 1.199 | 0.272 | 0.539 | −1.107 | 0.104 | 0.539 | 0.544 | 0.194 | 0.539 |
| 1.150 | 0.251 | 0.539 | −1.115 | 0.112 | 0.539 | 0.620 | 0.206 | 0.539 |
| 1.096 | 0.228 | 0.539 | −1.120 | 0.118 | 0.539 | 0.694 | 0.220 | 0.539 |
| 1.038 | 0.205 | 0.539 | −1.123 | 0.124 | 0.539 | 0.765 | 0.233 | 0.539 |
| 0.978 | 0.182 | 0.539 | −1.124 | 0.129 | 0.539 | 0.833 | 0.247 | 0.539 |
| 0.915 | 0.158 | 0.539 | −1.124 | 0.133 | 0.539 | 0.899 | 0.261 | 0.539 |
| 0.850 | 0.135 | 0.539 | −1.122 | 0.137 | 0.539 | 0.962 | 0.276 | 0.539 |

TABLE 12S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.781 | 0.112 | 0.539 | −1.119 | 0.141 | 0.539 | 1.022 | 0.291 | 0.539 |
| 0.710 | 0.088 | 0.539 | −1.113 | 0.144 | 0.539 | 1.079 | 0.306 | 0.539 |
| 0.635 | 0.066 | 0.539 | −1.106 | 0.147 | 0.539 | 1.134 | 0.321 | 0.539 |
| 0.558 | 0.043 | 0.539 | −1.096 | 0.150 | 0.539 | 1.184 | 0.336 | 0.539 |
| 0.480 | 0.022 | 0.539 | −1.083 | 0.152 | 0.539 | 1.228 | 0.349 | 0.539 |
| 0.402 | 0.003 | 0.539 | −1.066 | 0.153 | 0.539 | 1.268 | 0.362 | 0.539 |
| 0.324 | −0.015 | 0.539 | −1.046 | 0.153 | 0.539 | 1.305 | 0.374 | 0.539 |
| 0.245 | −0.031 | 0.539 | −1.021 | 0.152 | 0.539 | 1.337 | 0.384 | 0.539 |
| 0.166 | −0.045 | 0.539 | −0.993 | 0.151 | 0.539 | 1.361 | 0.392 | 0.539 |
| 0.086 | −0.057 | 0.539 | −0.960 | 0.148 | 0.539 | 1.381 | 0.399 | 0.539 |
| 0.007 | −0.067 | 0.539 | −0.921 | 0.145 | 0.539 | 1.395 | 0.404 | 0.539 |
| −0.073 | −0.074 | 0.539 | −0.877 | 0.142 | 0.539 | 1.407 | 0.403 | 0.539 |
| −0.154 | −0.079 | 0.539 | −0.828 | 0.138 | 0.539 | 1.412 | 0.400 | 0.539 |
| −0.234 | −0.082 | 0.539 | −0.774 | 0.134 | 0.539 | 1.415 | 0.397 | 0.539 |
| −0.314 | −0.081 | 0.539 | −0.715 | 0.129 | 0.539 | 1.416 | 0.395 | 0.539 |
| −0.392 | −0.078 | 0.539 | −0.653 | 0.125 | 0.539 | 1.416 | 0.394 | 0.539 |
| −0.467 | −0.072 | 0.539 | −0.588 | 0.122 | 0.539 | 1.416 | 0.394 | 0.539 |
| −0.539 | −0.065 | 0.539 | −0.521 | 0.119 | 0.539 | | | |
| −0.608 | −0.055 | 0.539 | −0.451 | 0.117 | 0.539 | | | |
| 1.198 | 0.603 | 1.078 | −0.743 | 0.133 | 1.078 | −0.478 | 0.285 | 1.078 |
| 1.199 | 0.602 | 1.078 | −0.803 | 0.140 | 1.078 | −0.408 | 0.288 | 1.078 |
| 1.199 | 0.600 | 1.078 | −0.860 | 0.149 | 1.078 | −0.336 | 0.293 | 1.078 |
| 1.200 | 0.596 | 1.078 | −0.911 | 0.158 | 1.078 | −0.263 | 0.299 | 1.078 |
| 1.199 | 0.590 | 1.078 | −0.958 | 0.167 | 1.078 | −0.190 | 0.305 | 1.078 |
| 1.192 | 0.581 | 1.078 | −0.999 | 0.177 | 1.078 | −0.118 | 0.313 | 1.078 |
| 1.179 | 0.574 | 1.078 | −1.036 | 0.186 | 1.078 | −0.046 | 0.321 | 1.078 |
| 1.161 | 0.565 | 1.078 | −1.067 | 0.195 | 1.078 | 0.027 | 0.330 | 1.078 |
| 1.138 | 0.554 | 1.078 | −1.093 | 0.204 | 1.078 | 0.099 | 0.340 | 1.078 |
| 1.109 | 0.540 | 1.078 | −1.115 | 0.212 | 1.078 | 0.171 | 0.351 | 1.078 |
| 1.075 | 0.524 | 1.078 | −1.134 | 0.219 | 1.078 | 0.242 | 0.363 | 1.078 |
| 1.039 | 0.507 | 1.078 | −1.148 | 0.226 | 1.078 | 0.314 | 0.376 | 1.078 |
| 0.998 | 0.488 | 1.078 | −1.160 | 0.233 | 1.078 | 0.385 | 0.390 | 1.078 |
| 0.952 | 0.467 | 1.078 | −1.168 | 0.239 | 1.078 | 0.457 | 0.405 | 1.078 |
| 0.902 | 0.446 | 1.078 | −1.173 | 0.245 | 1.078 | 0.525 | 0.420 | 1.078 |
| 0.849 | 0.423 | 1.078 | −1.177 | 0.250 | 1.078 | 0.591 | 0.435 | 1.078 |
| 0.793 | 0.400 | 1.078 | −1.178 | 0.255 | 1.078 | 0.655 | 0.451 | 1.078 |
| 0.735 | 0.377 | 1.078 | −1.178 | 0.259 | 1.078 | 0.716 | 0.466 | 1.078 |
| 0.674 | 0.354 | 1.078 | −1.177 | 0.262 | 1.078 | 0.775 | 0.482 | 1.078 |
| 0.610 | 0.331 | 1.078 | −1.174 | 0.266 | 1.078 | 0.831 | 0.498 | 1.078 |
| 0.544 | 0.308 | 1.078 | −1.169 | 0.269 | 1.078 | 0.884 | 0.514 | 1.078 |
| 0.475 | 0.285 | 1.078 | −1.162 | 0.273 | 1.078 | 0.935 | 0.530 | 1.078 |
| 0.404 | 0.263 | 1.078 | −1.153 | 0.276 | 1.078 | 0.982 | 0.545 | 1.078 |
| 0.332 | 0.242 | 1.078 | −1.141 | 0.278 | 1.078 | 1.023 | 0.559 | 1.078 |
| 0.259 | 0.222 | 1.078 | −1.125 | 0.280 | 1.078 | 1.060 | 0.572 | 1.078 |
| 0.187 | 0.203 | 1.078 | −1.106 | 0.282 | 1.078 | 1.094 | 0.584 | 1.078 |
| 0.114 | 0.186 | 1.078 | −1.083 | 0.282 | 1.078 | 1.124 | 0.595 | 1.078 |
| 0.040 | 0.171 | 1.078 | −1.056 | 0.282 | 1.078 | 1.147 | 0.603 | 1.078 |
| −0.034 | 0.158 | 1.078 | −1.025 | 0.282 | 1.078 | 1.165 | 0.610 | 1.078 |
| −0.108 | 0.146 | 1.078 | −0.988 | 0.281 | 1.078 | 1.179 | 0.615 | 1.078 |
| −0.182 | 0.136 | 1.078 | −0.947 | 0.280 | 1.078 | 1.189 | 0.613 | 1.078 |
| −0.257 | 0.129 | 1.078 | −0.901 | 0.279 | 1.078 | 1.194 | 0.610 | 1.078 |
| −0.332 | 0.123 | 1.078 | −0.850 | 0.279 | 1.078 | 1.197 | 0.607 | 1.078 |
| −0.406 | 0.120 | 1.078 | −0.794 | 0.278 | 1.078 | 1.198 | 0.605 | 1.078 |
| −0.479 | 0.119 | 1.078 | −0.736 | 0.278 | 1.078 | 1.198 | 0.604 | 1.078 |
| −0.549 | 0.120 | 1.078 | −0.675 | 0.279 | 1.078 | 1.198 | 0.604 | 1.078 |
| −0.616 | 0.123 | 1.078 | −0.612 | 0.280 | 1.078 | | | |
| −0.681 | 0.127 | 1.078 | −0.546 | 0.282 | 1.078 | | | |
| 1.079 | 0.713 | 1.437 | −0.808 | 0.252 | 1.437 | −0.552 | 0.389 | 1.437 |
| 1.080 | 0.712 | 1.437 | −0.866 | 0.259 | 1.437 | −0.483 | 0.393 | 1.437 |
| 1.080 | 0.710 | 1.437 | −0.921 | 0.266 | 1.437 | −0.413 | 0.398 | 1.437 |
| 1.081 | 0.707 | 1.437 | −0.972 | 0.274 | 1.437 | −0.342 | 0.404 | 1.437 |
| 1.080 | 0.701 | 1.437 | −1.017 | 0.283 | 1.437 | −0.271 | 0.411 | 1.437 |
| 1.074 | 0.692 | 1.437 | −1.058 | 0.291 | 1.437 | −0.201 | 0.419 | 1.437 |
| 1.061 | 0.685 | 1.437 | −1.093 | 0.300 | 1.437 | −0.130 | 0.427 | 1.437 |
| 1.044 | 0.676 | 1.437 | −1.124 | 0.308 | 1.437 | −0.060 | 0.437 | 1.437 |
| 1.022 | 0.665 | 1.437 | −1.150 | 0.315 | 1.437 | 0.010 | 0.448 | 1.437 |
| 0.993 | 0.652 | 1.437 | −1.171 | 0.322 | 1.437 | 0.080 | 0.459 | 1.437 |
| 0.960 | 0.636 | 1.437 | −1.189 | 0.329 | 1.437 | 0.150 | 0.471 | 1.437 |
| 0.925 | 0.619 | 1.437 | −1.204 | 0.336 | 1.437 | 0.220 | 0.485 | 1.437 |
| 0.885 | 0.601 | 1.437 | −1.215 | 0.342 | 1.437 | 0.289 | 0.499 | 1.437 |
| 0.841 | 0.582 | 1.437 | −1.223 | 0.348 | 1.437 | 0.358 | 0.514 | 1.437 |
| 0.791 | 0.560 | 1.437 | −1.228 | 0.353 | 1.437 | 0.425 | 0.529 | 1.437 |
| 0.740 | 0.539 | 1.437 | −1.232 | 0.358 | 1.437 | 0.489 | 0.545 | 1.437 |
| 0.686 | 0.517 | 1.437 | −1.234 | 0.362 | 1.437 | 0.551 | 0.561 | 1.437 |
| 0.629 | 0.494 | 1.437 | −1.234 | 0.366 | 1.437 | 0.611 | 0.577 | 1.437 |
| 0.570 | 0.472 | 1.437 | −1.233 | 0.369 | 1.437 | 0.668 | 0.593 | 1.437 |
| 0.508 | 0.449 | 1.437 | −1.230 | 0.373 | 1.437 | 0.722 | 0.609 | 1.437 |

TABLE 12S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.444 | 0.427 | 1.437 | −1.225 | 0.376 | 1.437 | 0.774 | 0.625 | 1.437 |
| 0.377 | 0.405 | 1.437 | −1.218 | 0.379 | 1.437 | 0.824 | 0.641 | 1.437 |
| 0.307 | 0.383 | 1.437 | −1.209 | 0.382 | 1.437 | 0.869 | 0.656 | 1.437 |
| 0.237 | 0.362 | 1.437 | −1.197 | 0.384 | 1.437 | 0.909 | 0.670 | 1.437 |
| 0.167 | 0.343 | 1.437 | −1.182 | 0.386 | 1.437 | 0.944 | 0.682 | 1.437 |
| 0.096 | 0.325 | 1.437 | −1.163 | 0.387 | 1.437 | 0.978 | 0.694 | 1.437 |
| 0.025 | 0.308 | 1.437 | −1.141 | 0.388 | 1.437 | 1.007 | 0.705 | 1.437 |
| −0.046 | 0.293 | 1.437 | −1.115 | 0.388 | 1.437 | 1.029 | 0.713 | 1.437 |
| −0.118 | 0.280 | 1.437 | −1.084 | 0.387 | 1.437 | 1.047 | 0.720 | 1.437 |
| −0.190 | 0.268 | 1.437 | −1.049 | 0.386 | 1.437 | 1.060 | 0.725 | 1.437 |
| −0.262 | 0.259 | 1.437 | −1.008 | 0.385 | 1.437 | 1.070 | 0.723 | 1.437 |
| −0.335 | 0.251 | 1.437 | −0.963 | 0.384 | 1.437 | 1.075 | 0.719 | 1.437 |
| −0.408 | 0.245 | 1.437 | −0.914 | 0.384 | 1.437 | 1.078 | 0.717 | 1.437 |
| −0.480 | 0.242 | 1.437 | −0.859 | 0.383 | 1.437 | 1.079 | 0.715 | 1.437 |
| −0.551 | 0.240 | 1.437 | −0.802 | 0.383 | 1.437 | 1.079 | 0.714 | 1.437 |
| −0.619 | 0.241 | 1.437 | −0.743 | 0.384 | 1.437 | 1.079 | 0.714 | 1.437 |
| −0.684 | 0.243 | 1.437 | −0.682 | 0.385 | 1.437 | | | |
| −0.748 | 0.247 | 1.437 | −0.618 | 0.387 | 1.437 | | | |
| 0.912 | 0.849 | 2.155 | −0.891 | 0.419 | 2.155 | −0.645 | 0.534 | 2.155 |
| 0.913 | 0.848 | 2.155 | −0.946 | 0.425 | 2.155 | −0.580 | 0.537 | 2.155 |
| 0.913 | 0.846 | 2.155 | −0.999 | 0.433 | 2.155 | −0.512 | 0.542 | 2.155 |
| 0.914 | 0.842 | 2.155 | −1.047 | 0.441 | 2.155 | −0.444 | 0.547 | 2.155 |
| 0.913 | 0.837 | 2.155 | −1.090 | 0.449 | 2.155 | −0.377 | 0.553 | 2.155 |
| 0.908 | 0.828 | 2.155 | −1.129 | 0.457 | 2.155 | −0.309 | 0.561 | 2.155 |
| 0.896 | 0.821 | 2.155 | −1.163 | 0.465 | 2.155 | −0.242 | 0.570 | 2.155 |
| 0.879 | 0.813 | 2.155 | −1.192 | 0.473 | 2.155 | −0.175 | 0.579 | 2.155 |
| 0.858 | 0.803 | 2.155 | −1.217 | 0.479 | 2.155 | −0.108 | 0.590 | 2.155 |
| 0.831 | 0.790 | 2.155 | −1.237 | 0.486 | 2.155 | −0.041 | 0.601 | 2.155 |
| 0.799 | 0.775 | 2.155 | −1.255 | 0.492 | 2.155 | 0.025 | 0.614 | 2.155 |
| 0.765 | 0.760 | 2.155 | −1.269 | 0.498 | 2.155 | 0.092 | 0.627 | 2.155 |
| 0.727 | 0.743 | 2.155 | −1.279 | 0.504 | 2.155 | 0.158 | 0.641 | 2.155 |
| 0.684 | 0.724 | 2.155 | −1.287 | 0.510 | 2.155 | 0.224 | 0.656 | 2.155 |
| 0.637 | 0.704 | 2.155 | −1.292 | 0.514 | 2.155 | 0.288 | 0.671 | 2.155 |
| 0.588 | 0.684 | 2.155 | −1.296 | 0.519 | 2.155 | 0.349 | 0.687 | 2.155 |
| 0.536 | 0.663 | 2.155 | −1.298 | 0.523 | 2.155 | 0.408 | 0.702 | 2.155 |
| 0.482 | 0.642 | 2.155 | −1.298 | 0.527 | 2.155 | 0.465 | 0.718 | 2.155 |
| 0.425 | 0.621 | 2.155 | −1.297 | 0.530 | 2.155 | 0.519 | 0.733 | 2.155 |
| 0.366 | 0.600 | 2.155 | −1.293 | 0.533 | 2.155 | 0.571 | 0.749 | 2.155 |
| 0.305 | 0.579 | 2.155 | −1.289 | 0.536 | 2.155 | 0.621 | 0.765 | 2.155 |
| 0.241 | 0.558 | 2.155 | −1.282 | 0.539 | 2.155 | 0.668 | 0.780 | 2.155 |
| 0.174 | 0.537 | 2.155 | −1.274 | 0.541 | 2.155 | 0.711 | 0.795 | 2.155 |
| 0.108 | 0.518 | 2.155 | −1.262 | 0.543 | 2.155 | 0.750 | 0.808 | 2.155 |
| 0.040 | 0.499 | 2.155 | −1.247 | 0.544 | 2.155 | 0.784 | 0.820 | 2.155 |
| −0.027 | 0.482 | 2.155 | −1.229 | 0.544 | 2.155 | 0.816 | 0.832 | 2.155 |
| −0.095 | 0.466 | 2.155 | −1.208 | 0.544 | 2.155 | 0.843 | 0.842 | 2.155 |
| −0.163 | 0.452 | 2.155 | −1.183 | 0.543 | 2.155 | 0.864 | 0.850 | 2.155 |
| −0.232 | 0.440 | 2.155 | −1.154 | 0.542 | 2.155 | 0.881 | 0.857 | 2.155 |
| −0.300 | 0.429 | 2.155 | −1.120 | 0.540 | 2.155 | 0.894 | 0.861 | 2.155 |
| −0.370 | 0.420 | 2.155 | −1.082 | 0.538 | 2.155 | 0.904 | 0.858 | 2.155 |
| −0.439 | 0.414 | 2.155 | −1.039 | 0.536 | 2.155 | 0.909 | 0.855 | 2.155 |
| −0.508 | 0.409 | 2.155 | −0.991 | 0.535 | 2.155 | 0.911 | 0.852 | 2.155 |
| −0.578 | 0.406 | 2.155 | −0.939 | 0.533 | 2.155 | 0.912 | 0.851 | 2.155 |
| −0.645 | 0.405 | 2.155 | −0.885 | 0.532 | 2.155 | 0.912 | 0.850 | 2.155 |
| −0.710 | 0.406 | 2.155 | −0.828 | 0.531 | 2.155 | 0.912 | 0.849 | 2.155 |
| −0.773 | 0.409 | 2.155 | −0.769 | 0.531 | 2.155 | | | |
| −0.833 | 0.413 | 2.155 | −0.708 | 0.532 | 2.155 | | | |
| 0.876 | 0.832 | 2.874 | −0.842 | 0.417 | 2.874 | −0.606 | 0.528 | 2.874 |
| 0.876 | 0.831 | 2.874 | −0.895 | 0.425 | 2.874 | −0.543 | 0.530 | 2.874 |
| 0.877 | 0.830 | 2.874 | −0.945 | 0.433 | 2.874 | −0.479 | 0.534 | 2.874 |
| 0.877 | 0.826 | 2.874 | −0.991 | 0.442 | 2.874 | −0.414 | 0.539 | 2.874 |
| 0.877 | 0.821 | 2.874 | −1.032 | 0.451 | 2.874 | −0.350 | 0.545 | 2.874 |
| 0.872 | 0.812 | 2.874 | −1.069 | 0.460 | 2.874 | −0.286 | 0.553 | 2.874 |
| 0.861 | 0.805 | 2.874 | −1.101 | 0.469 | 2.874 | −0.222 | 0.561 | 2.874 |
| 0.845 | 0.797 | 2.874 | −1.129 | 0.477 | 2.874 | −0.158 | 0.571 | 2.874 |
| 0.825 | 0.787 | 2.874 | −1.152 | 0.484 | 2.874 | −0.094 | 0.581 | 2.874 |
| 0.799 | 0.775 | 2.874 | −1.172 | 0.491 | 2.874 | −0.031 | 0.593 | 2.874 |
| 0.769 | 0.760 | 2.874 | −1.188 | 0.497 | 2.874 | 0.032 | 0.605 | 2.874 |
| 0.737 | 0.745 | 2.874 | −1.201 | 0.504 | 2.874 | 0.096 | 0.618 | 2.874 |
| 0.701 | 0.729 | 2.874 | −1.211 | 0.510 | 2.874 | 0.159 | 0.632 | 2.874 |
| 0.660 | 0.711 | 2.874 | −1.218 | 0.515 | 2.874 | 0.221 | 0.647 | 2.874 |
| 0.615 | 0.691 | 2.874 | −1.223 | 0.520 | 2.874 | 0.282 | 0.661 | 2.874 |
| 0.568 | 0.671 | 2.874 | −1.226 | 0.524 | 2.874 | 0.340 | 0.676 | 2.874 |
| 0.519 | 0.651 | 2.874 | −1.228 | 0.528 | 2.874 | 0.397 | 0.691 | 2.874 |
| 0.467 | 0.630 | 2.874 | −1.228 | 0.532 | 2.874 | 0.450 | 0.707 | 2.874 |
| 0.414 | 0.609 | 2.874 | −1.227 | 0.535 | 2.874 | 0.502 | 0.722 | 2.874 |
| 0.357 | 0.588 | 2.874 | −1.224 | 0.538 | 2.874 | 0.552 | 0.737 | 2.874 |
| 0.299 | 0.567 | 2.874 | −1.219 | 0.541 | 2.874 | 0.599 | 0.752 | 2.874 |

TABLE 12S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.238 | 0.547 | 2.874 | −1.213 | 0.543 | 2.874 | 0.644 | 0.767 | 2.874 |
| 0.175 | 0.526 | 2.874 | −1.204 | 0.545 | 2.874 | 0.684 | 0.781 | 2.874 |
| 0.111 | 0.507 | 2.874 | −1.193 | 0.546 | 2.874 | 0.721 | 0.794 | 2.874 |
| 0.047 | 0.489 | 2.874 | −1.179 | 0.547 | 2.874 | 0.753 | 0.806 | 2.874 |
| −0.017 | 0.472 | 2.874 | −1.162 | 0.547 | 2.874 | 0.784 | 0.817 | 2.874 |
| −0.082 | 0.456 | 2.874 | −1.142 | 0.546 | 2.874 | 0.810 | 0.827 | 2.874 |
| −0.147 | 0.442 | 2.874 | −1.118 | 0.545 | 2.874 | 0.830 | 0.834 | 2.874 |
| −0.213 | 0.430 | 2.874 | −1.090 | 0.543 | 2.874 | 0.846 | 0.841 | 2.874 |
| −0.279 | 0.420 | 2.874 | −1.058 | 0.540 | 2.874 | 0.858 | 0.844 | 2.874 |
| −0.345 | 0.411 | 2.874 | −1.022 | 0.538 | 2.874 | 0.868 | 0.841 | 2.874 |
| −0.411 | 0.405 | 2.874 | −0.981 | 0.535 | 2.874 | 0.872 | 0.838 | 2.874 |
| −0.477 | 0.401 | 2.874 | −0.935 | 0.532 | 2.874 | 0.874 | 0.835 | 2.874 |
| −0.544 | 0.400 | 2.874 | −0.886 | 0.530 | 2.874 | 0.875 | 0.834 | 2.874 |
| −0.608 | 0.400 | 2.874 | −0.834 | 0.528 | 2.874 | 0.875 | 0.833 | 2.874 |
| −0.670 | 0.402 | 2.874 | −0.780 | 0.527 | 2.874 | 0.876 | 0.833 | 2.874 |
| −0.730 | 0.406 | 2.874 | −0.724 | 0.526 | 2.874 | | | |
| −0.787 | 0.411 | 2.874 | −0.666 | 0.526 | 2.874 | | | |
| 0.973 | 0.659 | 3.592 | −0.658 | 0.259 | 3.592 | −0.431 | 0.365 | 3.592 |
| 0.974 | 0.658 | 3.592 | −0.708 | 0.268 | 3.592 | −0.372 | 0.367 | 3.592 |
| 0.974 | 0.657 | 3.592 | −0.756 | 0.277 | 3.592 | −0.311 | 0.370 | 3.592 |
| 0.975 | 0.653 | 3.592 | −0.799 | 0.286 | 3.592 | −0.249 | 0.375 | 3.592 |
| 0.974 | 0.648 | 3.592 | −0.838 | 0.296 | 3.592 | −0.188 | 0.381 | 3.592 |
| 0.971 | 0.639 | 3.592 | −0.872 | 0.305 | 3.592 | −0.127 | 0.388 | 3.592 |
| 0.960 | 0.632 | 3.592 | −0.903 | 0.314 | 3.592 | −0.067 | 0.396 | 3.592 |
| 0.945 | 0.624 | 3.592 | −0.929 | 0.323 | 3.592 | −0.006 | 0.405 | 3.592 |
| 0.927 | 0.614 | 3.592 | −0.951 | 0.330 | 3.592 | 0.054 | 0.416 | 3.592 |
| 0.902 | 0.602 | 3.592 | −0.970 | 0.338 | 3.592 | 0.115 | 0.427 | 3.592 |
| 0.874 | 0.588 | 3.592 | −0.985 | 0.344 | 3.592 | 0.175 | 0.439 | 3.592 |
| 0.843 | 0.573 | 3.592 | −0.997 | 0.351 | 3.592 | 0.234 | 0.451 | 3.592 |
| 0.809 | 0.556 | 3.592 | −1.006 | 0.357 | 3.592 | 0.294 | 0.465 | 3.592 |
| 0.771 | 0.538 | 3.592 | −1.013 | 0.362 | 3.592 | 0.354 | 0.479 | 3.592 |
| 0.728 | 0.519 | 3.592 | −1.018 | 0.367 | 3.592 | 0.411 | 0.493 | 3.592 |
| 0.684 | 0.499 | 3.592 | −1.021 | 0.371 | 3.592 | 0.467 | 0.507 | 3.592 |
| 0.637 | 0.479 | 3.592 | −1.022 | 0.375 | 3.592 | 0.520 | 0.522 | 3.592 |
| 0.588 | 0.459 | 3.592 | −1.022 | 0.378 | 3.592 | 0.571 | 0.537 | 3.592 |
| 0.537 | 0.438 | 3.592 | −1.021 | 0.381 | 3.592 | 0.620 | 0.551 | 3.592 |
| 0.484 | 0.417 | 3.592 | −1.018 | 0.384 | 3.592 | 0.667 | 0.566 | 3.592 |
| 0.429 | 0.397 | 3.592 | −1.013 | 0.386 | 3.592 | 0.711 | 0.581 | 3.592 |
| 0.371 | 0.376 | 3.592 | −1.008 | 0.388 | 3.592 | 0.754 | 0.595 | 3.592 |
| 0.311 | 0.356 | 3.592 | −0.999 | 0.390 | 3.592 | 0.792 | 0.609 | 3.592 |
| 0.250 | 0.337 | 3.592 | −0.989 | 0.391 | 3.592 | 0.827 | 0.622 | 3.592 |
| 0.189 | 0.319 | 3.592 | −0.976 | 0.392 | 3.592 | 0.858 | 0.633 | 3.592 |
| 0.128 | 0.303 | 3.592 | −0.959 | 0.391 | 3.592 | 0.886 | 0.644 | 3.592 |
| 0.066 | 0.288 | 3.592 | −0.940 | 0.390 | 3.592 | 0.911 | 0.654 | 3.592 |
| 0.005 | 0.274 | 3.592 | −0.918 | 0.388 | 3.592 | 0.930 | 0.662 | 3.592 |
| −0.058 | 0.263 | 3.592 | −0.891 | 0.386 | 3.592 | 0.945 | 0.668 | 3.592 |
| −0.121 | 0.253 | 3.592 | −0.861 | 0.383 | 3.592 | 0.957 | 0.671 | 3.592 |
| −0.184 | 0.246 | 3.592 | −0.826 | 0.380 | 3.592 | 0.966 | 0.668 | 3.592 |
| −0.247 | 0.241 | 3.592 | −0.787 | 0.376 | 3.592 | 0.970 | 0.665 | 3.592 |
| −0.310 | 0.238 | 3.592 | −0.744 | 0.373 | 3.592 | 0.972 | 0.662 | 3.592 |
| −0.374 | 0.237 | 3.592 | −0.697 | 0.370 | 3.592 | 0.973 | 0.661 | 3.592 |
| −0.435 | 0.238 | 3.592 | −0.648 | 0.368 | 3.592 | 0.973 | 0.660 | 3.592 |
| −0.494 | 0.241 | 3.592 | −0.597 | 0.366 | 3.592 | 0.973 | 0.659 | 3.592 |
| −0.551 | 0.246 | 3.592 | −0.544 | 0.365 | 3.592 | | | |
| −0.606 | 0.252 | 3.592 | −0.488 | 0.364 | 3.592 | | | |
| 1.048 | 0.542 | 3.951 | −0.543 | 0.156 | 3.951 | −0.321 | 0.258 | 3.951 |
| 1.049 | 0.541 | 3.951 | −0.591 | 0.165 | 3.951 | −0.263 | 0.260 | 3.951 |
| 1.049 | 0.540 | 3.951 | −0.638 | 0.174 | 3.951 | −0.203 | 0.263 | 3.951 |
| 1.050 | 0.537 | 3.951 | −0.680 | 0.184 | 3.951 | −0.144 | 0.267 | 3.951 |
| 1.050 | 0.531 | 3.951 | −0.718 | 0.194 | 3.951 | −0.084 | 0.273 | 3.951 |
| 1.046 | 0.523 | 3.951 | −0.751 | 0.203 | 3.951 | −0.025 | 0.280 | 3.951 |
| 1.036 | 0.516 | 3.951 | −0.781 | 0.212 | 3.951 | 0.035 | 0.288 | 3.951 |
| 1.022 | 0.508 | 3.951 | −0.807 | 0.221 | 3.951 | 0.094 | 0.297 | 3.951 |
| 1.003 | 0.498 | 3.951 | −0.828 | 0.229 | 3.951 | 0.152 | 0.306 | 3.951 |
| 0.979 | 0.486 | 3.951 | −0.846 | 0.236 | 3.951 | 0.211 | 0.317 | 3.951 |
| 0.952 | 0.472 | 3.951 | −0.861 | 0.243 | 3.951 | 0.270 | 0.329 | 3.951 |
| 0.922 | 0.457 | 3.951 | −0.873 | 0.249 | 3.951 | 0.328 | 0.341 | 3.951 |
| 0.889 | 0.441 | 3.951 | −0.882 | 0.255 | 3.951 | 0.386 | 0.353 | 3.951 |
| 0.851 | 0.423 | 3.951 | −0.888 | 0.260 | 3.951 | 0.444 | 0.367 | 3.951 |
| 0.810 | 0.404 | 3.951 | −0.893 | 0.264 | 3.951 | 0.500 | 0.381 | 3.951 |
| 0.767 | 0.385 | 3.951 | −0.896 | 0.269 | 3.951 | 0.554 | 0.395 | 3.951 |
| 0.721 | 0.365 | 3.951 | −0.897 | 0.273 | 3.951 | 0.606 | 0.409 | 3.951 |
| 0.674 | 0.345 | 3.951 | −0.897 | 0.276 | 3.951 | 0.656 | 0.423 | 3.951 |
| 0.624 | 0.325 | 3.951 | −0.895 | 0.279 | 3.951 | 0.704 | 0.437 | 3.951 |
| 0.572 | 0.305 | 3.951 | −0.893 | 0.281 | 3.951 | 0.750 | 0.452 | 3.951 |
| 0.518 | 0.285 | 3.951 | −0.888 | 0.284 | 3.951 | 0.793 | 0.466 | 3.951 |
| 0.461 | 0.265 | 3.951 | −0.882 | 0.285 | 3.951 | 0.835 | 0.480 | 3.951 |

TABLE 12S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.403 | 0.246 | 3.951 | −0.875 | 0.287 | 3.951 | 0.872 | 0.494 | 3.951 |
| 0.344 | 0.227 | 3.951 | −0.864 | 0.288 | 3.951 | 0.906 | 0.506 | 3.951 |
| 0.284 | 0.210 | 3.951 | −0.851 | 0.288 | 3.951 | 0.936 | 0.517 | 3.951 |
| 0.224 | 0.194 | 3.951 | −0.835 | 0.288 | 3.951 | 0.964 | 0.528 | 3.951 |
| 0.164 | 0.180 | 3.951 | −0.817 | 0.286 | 3.951 | 0.988 | 0.538 | 3.951 |
| 0.104 | 0.167 | 3.951 | −0.795 | 0.284 | 3.951 | 1.006 | 0.545 | 3.951 |
| 0.043 | 0.156 | 3.951 | −0.769 | 0.281 | 3.951 | 1.021 | 0.551 | 3.951 |
| −0.018 | 0.147 | 3.951 | −0.739 | 0.278 | 3.951 | 1.032 | 0.554 | 3.951 |
| −0.080 | 0.140 | 3.951 | −0.705 | 0.275 | 3.951 | 1.041 | 0.551 | 3.951 |
| −0.142 | 0.136 | 3.951 | −0.668 | 0.271 | 3.951 | 1.045 | 0.548 | 3.951 |
| −0.204 | 0.133 | 3.951 | −0.626 | 0.268 | 3.951 | 1.047 | 0.545 | 3.951 |
| −0.266 | 0.132 | 3.951 | −0.580 | 0.264 | 3.951 | 1.048 | 0.544 | 3.951 |
| −0.325 | 0.134 | 3.951 | −0.532 | 0.261 | 3.951 | 1.048 | 0.543 | 3.951 |
| −0.383 | 0.137 | 3.951 | −0.482 | 0.259 | 3.951 | 1.048 | 0.543 | 3.951 |
| −0.438 | 0.142 | 3.951 | −0.431 | 0.258 | 3.951 | | | |
| −0.492 | 0.148 | 3.951 | −0.377 | 0.258 | 3.951 | | | |
| 1.132 | 0.415 | 4.310 | −0.421 | 0.045 | 4.310 | −0.204 | 0.144 | 4.310 |
| 1.133 | 0.414 | 4.310 | −0.469 | 0.054 | 4.310 | −0.148 | 0.146 | 4.310 |
| 1.133 | 0.413 | 4.310 | −0.514 | 0.064 | 4.310 | −0.090 | 0.149 | 4.310 |
| 1.134 | 0.410 | 4.310 | −0.555 | 0.074 | 4.310 | −0.031 | 0.153 | 4.310 |
| 1.134 | 0.405 | 4.310 | −0.592 | 0.084 | 4.310 | 0.027 | 0.158 | 4.310 |
| 1.130 | 0.396 | 4.310 | −0.625 | 0.094 | 4.310 | 0.085 | 0.164 | 4.310 |
| 1.121 | 0.389 | 4.310 | −0.654 | 0.103 | 4.310 | 0.143 | 0.172 | 4.310 |
| 1.107 | 0.381 | 4.310 | −0.678 | 0.112 | 4.310 | 0.200 | 0.180 | 4.310 |
| 1.089 | 0.372 | 4.310 | −0.699 | 0.120 | 4.310 | 0.258 | 0.189 | 4.310 |
| 1.065 | 0.360 | 4.310 | −0.717 | 0.127 | 4.310 | 0.315 | 0.199 | 4.310 |
| 1.039 | 0.346 | 4.310 | −0.731 | 0.134 | 4.310 | 0.372 | 0.210 | 4.310 |
| 1.010 | 0.332 | 4.310 | −0.742 | 0.140 | 4.310 | 0.429 | 0.221 | 4.310 |
| 0.977 | 0.316 | 4.310 | −0.751 | 0.146 | 4.310 | 0.486 | 0.234 | 4.310 |
| 0.941 | 0.299 | 4.310 | −0.757 | 0.151 | 4.310 | 0.543 | 0.246 | 4.310 |
| 0.900 | 0.280 | 4.310 | −0.762 | 0.156 | 4.310 | 0.598 | 0.259 | 4.310 |
| 0.858 | 0.261 | 4.310 | −0.765 | 0.160 | 4.310 | 0.650 | 0.273 | 4.310 |
| 0.813 | 0.242 | 4.310 | −0.766 | 0.164 | 4.310 | 0.701 | 0.286 | 4.310 |
| 0.767 | 0.223 | 4.310 | −0.766 | 0.167 | 4.310 | 0.750 | 0.300 | 4.310 |
| 0.718 | 0.203 | 4.310 | −0.764 | 0.169 | 4.310 | 0.796 | 0.314 | 4.310 |
| 0.668 | 0.183 | 4.310 | −0.761 | 0.172 | 4.310 | 0.841 | 0.328 | 4.310 |
| 0.615 | 0.164 | 4.310 | −0.757 | 0.174 | 4.310 | 0.883 | 0.342 | 4.310 |
| 0.559 | 0.145 | 4.310 | −0.751 | 0.176 | 4.310 | 0.924 | 0.355 | 4.310 |
| 0.502 | 0.126 | 4.310 | −0.744 | 0.177 | 4.310 | 0.960 | 0.368 | 4.310 |
| 0.444 | 0.108 | 4.310 | −0.734 | 0.178 | 4.310 | 0.993 | 0.380 | 4.310 |
| 0.386 | 0.092 | 4.310 | −0.721 | 0.178 | 4.310 | 1.022 | 0.391 | 4.310 |
| 0.328 | 0.077 | 4.310 | −0.706 | 0.177 | 4.310 | 1.050 | 0.402 | 4.310 |
| 0.269 | 0.063 | 4.310 | −0.687 | 0.175 | 4.310 | 1.073 | 0.411 | 4.310 |
| 0.210 | 0.051 | 4.310 | −0.666 | 0.173 | 4.310 | 1.091 | 0.418 | 4.310 |
| 0.150 | 0.041 | 4.310 | −0.641 | 0.170 | 4.310 | 1.106 | 0.424 | 4.310 |
| 0.090 | 0.033 | 4.310 | −0.612 | 0.167 | 4.310 | 1.117 | 0.426 | 4.310 |
| 0.030 | 0.026 | 4.310 | −0.579 | 0.163 | 4.310 | 1.125 | 0.424 | 4.310 |
| −0.030 | 0.022 | 4.310 | −0.542 | 0.159 | 4.310 | 1.129 | 0.420 | 4.310 |
| −0.091 | 0.020 | 4.310 | −0.502 | 0.155 | 4.310 | 1.131 | 0.418 | 4.310 |
| −0.151 | 0.020 | 4.310 | −0.457 | 0.152 | 4.310 | 1.132 | 0.417 | 4.310 |
| −0.209 | 0.022 | 4.310 | −0.410 | 0.149 | 4.310 | 1.132 | 0.416 | 4.310 |
| −0.266 | 0.026 | 4.310 | −0.362 | 0.146 | 4.310 | 1.132 | 0.416 | 4.310 |
| −0.320 | 0.031 | 4.310 | −0.311 | 0.145 | 4.310 | | | |
| −0.372 | 0.038 | 4.310 | −0.259 | 0.144 | 4.310 | | | |
| 1.280 | 0.199 | 4.849 | −0.256 | −0.114 | 4.849 | −0.039 | −0.027 | 4.849 |
| 1.280 | 0.198 | 4.849 | −0.302 | −0.102 | 4.849 | 0.017 | −0.028 | 4.849 |
| 1.281 | 0.197 | 4.849 | −0.346 | −0.090 | 4.849 | 0.074 | −0.028 | 4.849 |
| 1.282 | 0.194 | 4.849 | −0.386 | −0.078 | 4.849 | 0.131 | −0.026 | 4.849 |
| 1.282 | 0.189 | 4.849 | −0.422 | −0.065 | 4.849 | 0.188 | −0.024 | 4.849 |
| 1.279 | 0.181 | 4.849 | −0.453 | −0.054 | 4.849 | 0.245 | −0.020 | 4.849 |
| 1.270 | 0.173 | 4.849 | −0.481 | −0.043 | 4.849 | 0.303 | −0.015 | 4.849 |
| 1.256 | 0.166 | 4.849 | −0.505 | −0.033 | 4.849 | 0.359 | −0.009 | 4.849 |
| 1.238 | 0.156 | 4.849 | −0.525 | −0.024 | 4.849 | 0.416 | −0.002 | 4.849 |
| 1.215 | 0.144 | 4.849 | −0.542 | −0.016 | 4.849 | 0.473 | 0.005 | 4.849 |
| 1.189 | 0.130 | 4.849 | −0.555 | −0.009 | 4.849 | 0.529 | 0.014 | 4.849 |
| 1.160 | 0.116 | 4.849 | −0.566 | −0.002 | 4.849 | 0.586 | 0.023 | 4.849 |
| 1.128 | 0.101 | 4.849 | −0.575 | 0.005 | 4.849 | 0.642 | 0.033 | 4.849 |
| 1.092 | 0.084 | 4.849 | −0.581 | 0.010 | 4.849 | 0.698 | 0.044 | 4.849 |
| 1.052 | 0.066 | 4.849 | −0.585 | 0.015 | 4.849 | 0.753 | 0.055 | 4.849 |
| 1.010 | 0.047 | 4.849 | −0.587 | 0.019 | 4.849 | 0.805 | 0.066 | 4.849 |
| 0.966 | 0.029 | 4.849 | −0.588 | 0.023 | 4.849 | 0.855 | 0.078 | 4.849 |
| 0.920 | 0.010 | 4.849 | −0.588 | 0.026 | 4.849 | 0.903 | 0.090 | 4.849 |
| 0.872 | −0.008 | 4.849 | −0.587 | 0.028 | 4.849 | 0.949 | 0.103 | 4.849 |
| 0.821 | −0.027 | 4.849 | −0.583 | 0.030 | 4.849 | 0.993 | 0.116 | 4.849 |
| 0.769 | −0.045 | 4.849 | −0.579 | 0.032 | 4.849 | 1.035 | 0.129 | 4.849 |
| 0.714 | −0.062 | 4.849 | −0.573 | 0.033 | 4.849 | 1.075 | 0.142 | 4.849 |
| 0.657 | −0.079 | 4.849 | −0.566 | 0.034 | 4.849 | 1.111 | 0.154 | 4.849 |

TABLE 12S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.599 | −0.094 | 4.849 | −0.556 | 0.034 | 4.849 | 1.143 | 0.166 | 4.849 |
| 0.541 | −0.109 | 4.849 | −0.543 | 0.033 | 4.849 | 1.172 | 0.176 | 4.849 |
| 0.483 | −0.122 | 4.849 | −0.528 | 0.032 | 4.849 | 1.199 | 0.186 | 4.849 |
| 0.424 | −0.133 | 4.849 | −0.511 | 0.029 | 4.849 | 1.222 | 0.196 | 4.849 |
| 0.366 | −0.142 | 4.849 | −0.490 | 0.026 | 4.849 | 1.240 | 0.203 | 4.849 |
| 0.307 | −0.149 | 4.849 | −0.466 | 0.021 | 4.849 | 1.254 | 0.208 | 4.849 |
| 0.247 | −0.154 | 4.849 | −0.437 | 0.016 | 4.849 | 1.265 | 0.210 | 4.849 |
| 0.188 | −0.158 | 4.849 | −0.405 | 0.011 | 4.849 | 1.273 | 0.207 | 4.849 |
| 0.128 | −0.159 | 4.849 | −0.369 | 0.005 | 4.849 | 1.277 | 0.204 | 4.849 |
| 0.068 | −0.157 | 4.849 | −0.330 | −0.001 | 4.849 | 1.279 | 0.202 | 4.849 |
| 0.009 | −0.154 | 4.849 | −0.286 | −0.007 | 4.849 | 1.280 | 0.201 | 4.849 |
| −0.049 | −0.149 | 4.849 | −0.241 | −0.012 | 4.849 | 1.280 | 0.200 | 4.849 |
| −0.104 | −0.142 | 4.849 | −0.193 | −0.017 | 4.849 | 1.280 | 0.200 | 4.849 |
| −0.157 | −0.134 | 4.849 | −0.143 | −0.021 | 4.849 | | | |
| −0.207 | −0.124 | 4.849 | −0.092 | −0.024 | 4.849 | | | |
| 1.496 | −0.116 | 5.657 | −0.252 | −0.130 | 5.657 | −0.003 | −0.122 | 5.657 |
| 1.496 | −0.117 | 5.657 | −0.299 | −0.102 | 5.657 | 0.057 | −0.141 | 5.657 |
| 1.497 | −0.119 | 5.657 | −0.343 | −0.075 | 5.657 | 0.119 | −0.159 | 5.657 |
| 1.498 | −0.123 | 5.657 | −0.383 | −0.049 | 5.657 | 0.182 | −0.175 | 5.657 |
| 1.497 | −0.128 | 5.657 | −0.419 | −0.025 | 5.657 | 0.246 | −0.189 | 5.657 |
| 1.492 | −0.137 | 5.657 | −0.451 | −0.002 | 5.657 | 0.309 | −0.201 | 5.657 |
| 1.480 | −0.144 | 5.657 | −0.479 | 0.017 | 5.657 | 0.373 | −0.211 | 5.657 |
| 1.464 | −0.153 | 5.657 | −0.503 | 0.035 | 5.657 | 0.436 | −0.219 | 5.657 |
| 1.444 | −0.163 | 5.657 | −0.522 | 0.050 | 5.657 | 0.500 | −0.226 | 5.657 |
| 1.417 | −0.176 | 5.657 | −0.539 | 0.064 | 5.657 | 0.564 | −0.230 | 5.657 |
| 1.386 | −0.190 | 5.657 | −0.553 | 0.076 | 5.657 | 0.628 | −0.233 | 5.657 |
| 1.353 | −0.205 | 5.657 | −0.563 | 0.086 | 5.657 | 0.693 | −0.235 | 5.657 |
| 1.315 | −0.221 | 5.657 | −0.571 | 0.095 | 5.657 | 0.757 | −0.234 | 5.657 |
| 1.273 | −0.238 | 5.657 | −0.577 | 0.102 | 5.657 | 0.822 | −0.232 | 5.657 |
| 1.226 | −0.256 | 5.657 | −0.581 | 0.108 | 5.657 | 0.884 | −0.228 | 5.657 |
| 1.177 | −0.274 | 5.657 | −0.583 | 0.113 | 5.657 | 0.945 | −0.223 | 5.657 |
| 1.125 | −0.291 | 5.657 | −0.584 | 0.118 | 5.657 | 1.003 | −0.216 | 5.657 |
| 1.071 | −0.307 | 5.657 | −0.583 | 0.121 | 5.657 | 1.059 | −0.208 | 5.657 |
| 1.013 | −0.323 | 5.657 | −0.580 | 0.123 | 5.657 | 1.112 | −0.200 | 5.657 |
| 0.954 | −0.337 | 5.657 | −0.576 | 0.124 | 5.657 | 1.163 | −0.190 | 5.657 |
| 0.891 | −0.350 | 5.657 | −0.571 | 0.124 | 5.657 | 1.212 | −0.180 | 5.657 |
| 0.827 | −0.360 | 5.657 | −0.564 | 0.123 | 5.657 | 1.258 | −0.170 | 5.657 |
| 0.760 | −0.369 | 5.657 | −0.556 | 0.120 | 5.657 | 1.300 | −0.159 | 5.657 |
| 0.692 | −0.374 | 5.657 | −0.545 | 0.117 | 5.657 | 1.338 | −0.149 | 5.657 |
| 0.625 | −0.377 | 5.657 | −0.532 | 0.111 | 5.657 | 1.371 | −0.139 | 5.657 |
| 0.557 | −0.376 | 5.657 | −0.517 | 0.104 | 5.657 | 1.402 | −0.129 | 5.657 |
| 0.489 | −0.373 | 5.657 | −0.498 | 0.095 | 5.657 | 1.429 | −0.120 | 5.657 |
| 0.421 | −0.366 | 5.657 | −0.477 | 0.084 | 5.657 | 1.450 | −0.113 | 5.657 |
| 0.353 | −0.356 | 5.657 | −0.452 | 0.071 | 5.657 | 1.466 | −0.108 | 5.657 |
| 0.286 | −0.343 | 5.657 | −0.423 | 0.057 | 5.657 | 1.479 | −0.105 | 5.657 |
| 0.220 | −0.327 | 5.657 | −0.389 | 0.040 | 5.657 | 1.488 | −0.107 | 5.657 |
| 0.154 | −0.309 | 5.657 | −0.352 | 0.022 | 5.657 | 1.492 | −0.111 | 5.657 |
| 0.089 | −0.287 | 5.657 | −0.311 | 0.002 | 5.657 | 1.494 | −0.113 | 5.657 |
| 0.025 | −0.264 | 5.657 | −0.266 | −0.018 | 5.657 | 1.495 | −0.115 | 5.657 |
| −0.036 | −0.238 | 5.657 | −0.218 | −0.039 | 5.657 | 1.496 | −0.116 | 5.657 |
| −0.094 | −0.212 | 5.657 | −0.168 | −0.060 | 5.657 | 1.496 | −0.116 | 5.657 |
| −0.149 | −0.185 | 5.657 | −0.116 | −0.081 | 5.657 | | | |
| −0.202 | −0.158 | 5.657 | −0.061 | −0.102 | 5.657 | | | |

The coordinate values given in TABLE 13S below provide the nominal profile envelope for an exemplary thirteenth stage stator.

TABLE 13S

| X-LOC | Y-LOC | Z-LOC | X-LOC | Y-LOC | Z-LOC | X-LOC | Y-LOC | Z-LOC |
|---|---|---|---|---|---|---|---|---|
| 1.591 | 0.158 | 0.000 | −0.819 | −0.119 | 0.000 | −0.452 | 0.065 | 0.000 |
| 1.591 | 0.157 | 0.000 | −0.887 | −0.090 | 0.000 | −0.367 | 0.059 | 0.000 |
| 1.591 | 0.154 | 0.000 | −0.951 | −0.060 | 0.000 | −0.280 | 0.055 | 0.000 |
| 1.591 | 0.150 | 0.000 | −1.008 | −0.031 | 0.000 | −0.193 | 0.053 | 0.000 |
| 1.587 | 0.143 | 0.000 | −1.059 | −0.003 | 0.000 | −0.107 | 0.052 | 0.000 |
| 1.576 | 0.136 | 0.000 | −1.103 | 0.024 | 0.000 | −0.020 | 0.053 | 0.000 |
| 1.558 | 0.129 | 0.000 | −1.142 | 0.049 | 0.000 | 0.067 | 0.055 | 0.000 |
| 1.535 | 0.120 | 0.000 | −1.175 | 0.072 | 0.000 | 0.154 | 0.056 | 0.000 |
| 1.507 | 0.109 | 0.000 | −1.202 | 0.093 | 0.000 | 0.241 | 0.058 | 0.000 |
| 1.469 | 0.095 | 0.000 | −1.224 | 0.112 | 0.000 | 0.328 | 0.061 | 0.000 |
| 1.426 | 0.079 | 0.000 | −1.242 | 0.128 | 0.000 | 0.414 | 0.064 | 0.000 |

TABLE 13S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.380 | 0.062 | 0.000 | −1.256 | 0.142 | 0.000 | 0.501 | 0.068 | 0.000 |
| 1.328 | 0.043 | 0.000 | −1.267 | 0.154 | 0.000 | 0.588 | 0.072 | 0.000 |
| 1.270 | 0.022 | 0.000 | −1.275 | 0.163 | 0.000 | 0.675 | 0.077 | 0.000 |
| 1.206 | 0.000 | 0.000 | −1.281 | 0.171 | 0.000 | 0.758 | 0.082 | 0.000 |
| 1.139 | −0.023 | 0.000 | −1.284 | 0.178 | 0.000 | 0.839 | 0.088 | 0.000 |
| 1.069 | −0.046 | 0.000 | −1.286 | 0.184 | 0.000 | 0.917 | 0.094 | 0.000 |
| 0.996 | −0.070 | 0.000 | −1.285 | 0.188 | 0.000 | 0.992 | 0.100 | 0.000 |
| 0.919 | −0.093 | 0.000 | −1.282 | 0.192 | 0.000 | 1.065 | 0.106 | 0.000 |
| 0.840 | −0.116 | 0.000 | −1.277 | 0.194 | 0.000 | 1.134 | 0.113 | 0.000 |
| 0.757 | −0.140 | 0.000 | −1.269 | 0.195 | 0.000 | 1.200 | 0.121 | 0.000 |
| 0.671 | −0.162 | 0.000 | −1.261 | 0.196 | 0.000 | 1.264 | 0.128 | 0.000 |
| 0.581 | −0.183 | 0.000 | −1.249 | 0.195 | 0.000 | 1.321 | 0.136 | 0.000 |
| 0.491 | −0.203 | 0.000 | −1.234 | 0.194 | 0.000 | 1.373 | 0.142 | 0.000 |
| 0.400 | −0.220 | 0.000 | −1.215 | 0.192 | 0.000 | 1.419 | 0.149 | 0.000 |
| 0.309 | −0.234 | 0.000 | −1.193 | 0.188 | 0.000 | 1.462 | 0.155 | 0.000 |
| 0.218 | −0.246 | 0.000 | −1.166 | 0.183 | 0.000 | 1.499 | 0.161 | 0.000 |
| 0.126 | −0.254 | 0.000 | −1.134 | 0.177 | 0.000 | 1.528 | 0.165 | 0.000 |
| 0.034 | −0.260 | 0.000 | −1.097 | 0.170 | 0.000 | 1.551 | 0.169 | 0.000 |
| −0.058 | −0.262 | 0.000 | −1.054 | 0.160 | 0.000 | 1.568 | 0.171 | 0.000 |
| −0.151 | −0.260 | 0.000 | −1.006 | 0.150 | 0.000 | 1.581 | 0.170 | 0.000 |
| −0.242 | −0.254 | 0.000 | −0.952 | 0.139 | 0.000 | 1.587 | 0.166 | 0.000 |
| −0.333 | −0.245 | 0.000 | −0.892 | 0.127 | 0.000 | 1.589 | 0.163 | 0.000 |
| −0.423 | −0.231 | 0.000 | −0.826 | 0.114 | 0.000 | 1.590 | 0.160 | 0.000 |
| −0.510 | −0.214 | 0.000 | −0.757 | 0.103 | 0.000 | 1.591 | 0.159 | 0.000 |
| −0.592 | −0.194 | 0.000 | −0.686 | 0.091 | 0.000 | 1.591 | 0.159 | 0.000 |
| −0.672 | −0.171 | 0.000 | −0.611 | 0.081 | 0.000 | | | |
| −0.747 | −0.146 | 0.000 | −0.533 | 0.072 | 0.000 | | | |
| 1.326 | 0.429 | 0.525 | −0.807 | −0.043 | 0.525 | −0.503 | 0.199 | 0.525 |
| 1.326 | 0.428 | 0.525 | −0.870 | −0.028 | 0.525 | −0.428 | 0.204 | 0.525 |
| 1.327 | 0.426 | 0.525 | −0.931 | −0.012 | 0.525 | −0.350 | 0.211 | 0.525 |
| 1.327 | 0.422 | 0.525 | −0.985 | 0.005 | 0.525 | −0.272 | 0.218 | 0.525 |
| 1.324 | 0.415 | 0.525 | −1.034 | 0.022 | 0.525 | −0.194 | 0.226 | 0.525 |
| 1.315 | 0.407 | 0.525 | −1.078 | 0.039 | 0.525 | −0.116 | 0.234 | 0.525 |
| 1.300 | 0.401 | 0.525 | −1.115 | 0.055 | 0.525 | −0.038 | 0.243 | 0.525 |
| 1.280 | 0.392 | 0.525 | −1.148 | 0.071 | 0.525 | 0.040 | 0.251 | 0.525 |
| 1.255 | 0.381 | 0.525 | −1.174 | 0.085 | 0.525 | 0.118 | 0.260 | 0.525 |
| 1.222 | 0.367 | 0.525 | −1.196 | 0.098 | 0.525 | 0.196 | 0.269 | 0.525 |
| 1.184 | 0.351 | 0.525 | −1.214 | 0.110 | 0.525 | 0.274 | 0.278 | 0.525 |
| 1.144 | 0.333 | 0.525 | −1.229 | 0.121 | 0.525 | 0.352 | 0.287 | 0.525 |
| 1.098 | 0.314 | 0.525 | −1.240 | 0.130 | 0.525 | 0.429 | 0.297 | 0.525 |
| 1.048 | 0.293 | 0.525 | −1.248 | 0.138 | 0.525 | 0.507 | 0.307 | 0.525 |
| 0.992 | 0.271 | 0.525 | −1.253 | 0.144 | 0.525 | 0.582 | 0.317 | 0.525 |
| 0.933 | 0.247 | 0.525 | −1.257 | 0.150 | 0.525 | 0.655 | 0.327 | 0.525 |
| 0.872 | 0.223 | 0.525 | −1.258 | 0.156 | 0.525 | 0.724 | 0.337 | 0.525 |
| 0.808 | 0.198 | 0.525 | −1.258 | 0.160 | 0.525 | 0.792 | 0.347 | 0.525 |
| 0.742 | 0.173 | 0.525 | −1.256 | 0.163 | 0.525 | 0.856 | 0.357 | 0.525 |
| 0.672 | 0.147 | 0.525 | −1.252 | 0.167 | 0.525 | 0.918 | 0.367 | 0.525 |
| 0.600 | 0.121 | 0.525 | −1.247 | 0.170 | 0.525 | 0.977 | 0.378 | 0.525 |
| 0.525 | 0.095 | 0.525 | −1.239 | 0.173 | 0.525 | 1.034 | 0.388 | 0.525 |
| 0.447 | 0.070 | 0.525 | −1.229 | 0.176 | 0.525 | 1.085 | 0.398 | 0.525 |
| 0.368 | 0.045 | 0.525 | −1.216 | 0.178 | 0.525 | 1.131 | 0.406 | 0.525 |
| 0.289 | 0.022 | 0.525 | −1.199 | 0.180 | 0.525 | 1.172 | 0.415 | 0.525 |
| 0.210 | 0.001 | 0.525 | −1.178 | 0.182 | 0.525 | 1.211 | 0.422 | 0.525 |
| 0.130 | −0.018 | 0.525 | −1.154 | 0.183 | 0.525 | 1.244 | 0.429 | 0.525 |
| 0.050 | −0.035 | 0.525 | −1.125 | 0.184 | 0.525 | 1.270 | 0.434 | 0.525 |
| −0.031 | −0.050 | 0.525 | −1.091 | 0.185 | 0.525 | 1.290 | 0.439 | 0.525 |
| −0.112 | −0.062 | 0.525 | −1.052 | 0.185 | 0.525 | 1.305 | 0.442 | 0.525 |
| −0.194 | −0.071 | 0.525 | −1.007 | 0.185 | 0.525 | 1.317 | 0.440 | 0.525 |
| −0.276 | −0.077 | 0.525 | −0.958 | 0.185 | 0.525 | 1.322 | 0.437 | 0.525 |
| −0.358 | −0.081 | 0.525 | −0.903 | 0.184 | 0.525 | 1.325 | 0.433 | 0.525 |
| −0.440 | −0.081 | 0.525 | −0.843 | 0.185 | 0.525 | 1.325 | 0.431 | 0.525 |
| −0.519 | −0.079 | 0.525 | −0.780 | 0.186 | 0.525 | 1.326 | 0.430 | 0.525 |
| −0.596 | −0.073 | 0.525 | −0.715 | 0.187 | 0.525 | 1.326 | 0.430 | 0.525 |
| −0.669 | −0.066 | 0.525 | −0.647 | 0.190 | 0.525 | | | |
| −0.740 | −0.055 | 0.525 | −0.576 | 0.194 | 0.525 | | | |
| 1.097 | 0.610 | 1.051 | −0.849 | 0.111 | 1.051 | −0.582 | 0.348 | 1.051 |
| 1.097 | 0.609 | 1.051 | −0.908 | 0.121 | 1.051 | −0.513 | 0.356 | 1.051 |
| 1.098 | 0.607 | 1.051 | −0.964 | 0.133 | 1.051 | −0.441 | 0.365 | 1.051 |
| 1.098 | 0.603 | 1.051 | −1.015 | 0.146 | 1.051 | −0.369 | 0.374 | 1.051 |
| 1.096 | 0.597 | 1.051 | −1.061 | 0.159 | 1.051 | −0.298 | 0.383 | 1.051 |
| 1.089 | 0.589 | 1.051 | −1.102 | 0.172 | 1.051 | −0.226 | 0.393 | 1.051 |
| 1.075 | 0.582 | 1.051 | −1.138 | 0.185 | 1.051 | −0.154 | 0.403 | 1.051 |
| 1.057 | 0.574 | 1.051 | −1.168 | 0.197 | 1.051 | −0.083 | 0.413 | 1.051 |
| 1.034 | 0.563 | 1.051 | −1.194 | 0.209 | 1.051 | −0.011 | 0.423 | 1.051 |
| 1.004 | 0.550 | 1.051 | −1.215 | 0.220 | 1.051 | 0.060 | 0.433 | 1.051 |
| 0.970 | 0.534 | 1.051 | −1.232 | 0.230 | 1.051 | 0.132 | 0.444 | 1.051 |
| 0.933 | 0.518 | 1.051 | −1.246 | 0.239 | 1.051 | 0.203 | 0.455 | 1.051 |

TABLE 13S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.891 | 0.499 | 1.051 | −1.256 | 0.247 | 1.051 | 0.275 | 0.466 | 1.051 |
| 0.845 | 0.479 | 1.051 | −1.264 | 0.253 | 1.051 | 0.346 | 0.478 | 1.051 |
| 0.795 | 0.456 | 1.051 | −1.269 | 0.259 | 1.051 | 0.415 | 0.489 | 1.051 |
| 0.741 | 0.433 | 1.051 | −1.273 | 0.265 | 1.051 | 0.481 | 0.501 | 1.051 |
| 0.686 | 0.409 | 1.051 | −1.274 | 0.270 | 1.051 | 0.545 | 0.512 | 1.051 |
| 0.628 | 0.384 | 1.051 | −1.274 | 0.273 | 1.051 | 0.607 | 0.523 | 1.051 |
| 0.568 | 0.359 | 1.051 | −1.273 | 0.277 | 1.051 | 0.666 | 0.535 | 1.051 |
| 0.505 | 0.333 | 1.051 | −1.270 | 0.280 | 1.051 | 0.723 | 0.546 | 1.051 |
| 0.439 | 0.307 | 1.051 | −1.265 | 0.284 | 1.051 | 0.777 | 0.557 | 1.051 |
| 0.371 | 0.280 | 1.051 | −1.258 | 0.287 | 1.051 | 0.829 | 0.568 | 1.051 |
| 0.300 | 0.254 | 1.051 | −1.249 | 0.290 | 1.051 | 0.876 | 0.578 | 1.051 |
| 0.229 | 0.229 | 1.051 | −1.237 | 0.293 | 1.051 | 0.919 | 0.587 | 1.051 |
| 0.157 | 0.206 | 1.051 | −1.222 | 0.297 | 1.051 | 0.956 | 0.595 | 1.051 |
| 0.084 | 0.184 | 1.051 | −1.203 | 0.300 | 1.051 | 0.992 | 0.603 | 1.051 |
| 0.012 | 0.164 | 1.051 | −1.180 | 0.303 | 1.051 | 1.022 | 0.610 | 1.051 |
| −0.062 | 0.146 | 1.051 | −1.154 | 0.305 | 1.051 | 1.046 | 0.615 | 1.051 |
| −0.136 | 0.130 | 1.051 | −1.123 | 0.308 | 1.051 | 1.064 | 0.620 | 1.051 |
| −0.210 | 0.117 | 1.051 | −1.087 | 0.311 | 1.051 | 1.078 | 0.623 | 1.051 |
| −0.285 | 0.106 | 1.051 | −1.046 | 0.313 | 1.051 | 1.089 | 0.621 | 1.051 |
| −0.360 | 0.098 | 1.051 | −1.000 | 0.315 | 1.051 | 1.093 | 0.617 | 1.051 |
| −0.435 | 0.093 | 1.051 | −0.950 | 0.318 | 1.051 | 1.096 | 0.614 | 1.051 |
| −0.511 | 0.090 | 1.051 | −0.894 | 0.321 | 1.051 | 1.096 | 0.612 | 1.051 |
| −0.584 | 0.089 | 1.051 | −0.837 | 0.325 | 1.051 | 1.097 | 0.611 | 1.051 |
| −0.654 | 0.091 | 1.051 | −0.776 | 0.330 | 1.051 | 1.097 | 0.610 | 1.051 |
| −0.722 | 0.096 | 1.051 | −0.714 | 0.335 | 1.051 | | | |
| −0.787 | 0.102 | 1.051 | −0.649 | 0.341 | 1.051 | | | |
| 0.984 | 0.702 | 1.401 | −0.898 | 0.224 | 1.401 | −0.639 | 0.446 | 1.401 |
| 0.984 | 0.701 | 1.401 | −0.955 | 0.234 | 1.401 | −0.572 | 0.453 | 1.401 |
| 0.985 | 0.699 | 1.401 | −1.009 | 0.246 | 1.401 | −0.503 | 0.461 | 1.401 |
| 0.985 | 0.695 | 1.401 | −1.059 | 0.258 | 1.401 | −0.433 | 0.470 | 1.401 |
| 0.983 | 0.689 | 1.401 | −1.103 | 0.271 | 1.401 | −0.364 | 0.479 | 1.401 |
| 0.976 | 0.681 | 1.401 | −1.143 | 0.284 | 1.401 | −0.295 | 0.488 | 1.401 |
| 0.963 | 0.675 | 1.401 | −1.177 | 0.296 | 1.401 | −0.226 | 0.498 | 1.401 |
| 0.945 | 0.667 | 1.401 | −1.207 | 0.308 | 1.401 | −0.156 | 0.507 | 1.401 |
| 0.923 | 0.656 | 1.401 | −1.231 | 0.319 | 1.401 | −0.087 | 0.517 | 1.401 |
| 0.894 | 0.643 | 1.401 | −1.252 | 0.329 | 1.401 | −0.018 | 0.527 | 1.401 |
| 0.861 | 0.628 | 1.401 | −1.268 | 0.339 | 1.401 | 0.051 | 0.538 | 1.401 |
| 0.825 | 0.612 | 1.401 | −1.282 | 0.348 | 1.401 | 0.120 | 0.549 | 1.401 |
| 0.785 | 0.594 | 1.401 | −1.292 | 0.355 | 1.401 | 0.189 | 0.560 | 1.401 |
| 0.741 | 0.574 | 1.401 | −1.300 | 0.361 | 1.401 | 0.258 | 0.571 | 1.401 |
| 0.692 | 0.552 | 1.401 | −1.305 | 0.367 | 1.401 | 0.325 | 0.583 | 1.401 |
| 0.641 | 0.530 | 1.401 | −1.308 | 0.372 | 1.401 | 0.389 | 0.594 | 1.401 |
| 0.587 | 0.506 | 1.401 | −1.310 | 0.377 | 1.401 | 0.451 | 0.605 | 1.401 |
| 0.531 | 0.482 | 1.401 | −1.309 | 0.381 | 1.401 | 0.510 | 0.617 | 1.401 |
| 0.473 | 0.457 | 1.401 | −1.308 | 0.384 | 1.401 | 0.568 | 0.628 | 1.401 |
| 0.412 | 0.432 | 1.401 | −1.305 | 0.388 | 1.401 | 0.622 | 0.639 | 1.401 |
| 0.348 | 0.407 | 1.401 | −1.300 | 0.391 | 1.401 | 0.675 | 0.650 | 1.401 |
| 0.282 | 0.381 | 1.401 | −1.294 | 0.394 | 1.401 | 0.725 | 0.661 | 1.401 |
| 0.214 | 0.356 | 1.401 | −1.285 | 0.397 | 1.401 | 0.771 | 0.671 | 1.401 |
| 0.145 | 0.332 | 1.401 | −1.273 | 0.400 | 1.401 | 0.812 | 0.680 | 1.401 |
| 0.075 | 0.309 | 1.401 | −1.258 | 0.402 | 1.401 | 0.848 | 0.688 | 1.401 |
| 0.005 | 0.288 | 1.401 | −1.240 | 0.405 | 1.401 | 0.882 | 0.696 | 1.401 |
| −0.065 | 0.269 | 1.401 | −1.219 | 0.408 | 1.401 | 0.912 | 0.702 | 1.401 |
| −0.136 | 0.252 | 1.401 | −1.193 | 0.410 | 1.401 | 0.934 | 0.708 | 1.401 |
| −0.208 | 0.237 | 1.401 | −1.163 | 0.412 | 1.401 | 0.952 | 0.712 | 1.401 |
| −0.280 | 0.225 | 1.401 | −1.128 | 0.414 | 1.401 | 0.966 | 0.715 | 1.401 |
| −0.353 | 0.215 | 1.401 | −1.088 | 0.416 | 1.401 | 0.976 | 0.712 | 1.401 |
| −0.425 | 0.208 | 1.401 | −1.044 | 0.418 | 1.401 | 0.980 | 0.708 | 1.401 |
| −0.498 | 0.203 | 1.401 | −0.995 | 0.421 | 1.401 | 0.982 | 0.705 | 1.401 |
| −0.571 | 0.201 | 1.401 | −0.942 | 0.423 | 1.401 | 0.983 | 0.704 | 1.401 |
| −0.642 | 0.201 | 1.401 | −0.886 | 0.426 | 1.401 | 0.984 | 0.703 | 1.401 |
| −0.710 | 0.204 | 1.401 | −0.828 | 0.430 | 1.401 | 0.984 | 0.702 | 1.401 |
| −0.775 | 0.208 | 1.401 | −0.767 | 0.435 | 1.401 | | | |
| −0.838 | 0.215 | 1.401 | −0.704 | 0.440 | 1.401 | | | |
| 0.895 | 0.784 | 1.751 | −0.950 | 0.325 | 1.751 | −0.696 | 0.534 | 1.751 |
| 0.895 | 0.783 | 1.751 | −1.006 | 0.335 | 1.751 | −0.630 | 0.541 | 1.751 |
| 0.896 | 0.781 | 1.751 | −1.059 | 0.347 | 1.751 | −0.562 | 0.548 | 1.751 |
| 0.896 | 0.778 | 1.751 | −1.107 | 0.359 | 1.751 | −0.494 | 0.556 | 1.751 |
| 0.895 | 0.772 | 1.751 | −1.151 | 0.372 | 1.751 | −0.426 | 0.565 | 1.751 |
| 0.888 | 0.763 | 1.751 | −1.190 | 0.384 | 1.751 | −0.358 | 0.574 | 1.751 |
| 0.875 | 0.757 | 1.751 | −1.223 | 0.397 | 1.751 | −0.290 | 0.583 | 1.751 |
| 0.857 | 0.749 | 1.751 | −1.252 | 0.408 | 1.751 | −0.222 | 0.593 | 1.751 |
| 0.836 | 0.739 | 1.751 | −1.276 | 0.419 | 1.751 | −0.154 | 0.602 | 1.751 |
| 0.807 | 0.727 | 1.751 | −1.297 | 0.429 | 1.751 | −0.087 | 0.612 | 1.751 |
| 0.775 | 0.712 | 1.751 | −1.313 | 0.438 | 1.751 | −0.019 | 0.622 | 1.751 |
| 0.740 | 0.696 | 1.751 | −1.326 | 0.447 | 1.751 | 0.049 | 0.633 | 1.751 |
| 0.701 | 0.679 | 1.751 | −1.337 | 0.454 | 1.751 | 0.117 | 0.644 | 1.751 |

TABLE 13S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.657 | 0.659 | 1.751 | −1.344 | 0.460 | 1.751 | 0.184 | 0.655 | 1.751 |
| 0.609 | 0.638 | 1.751 | −1.349 | 0.465 | 1.751 | 0.249 | 0.667 | 1.751 |
| 0.559 | 0.616 | 1.751 | −1.352 | 0.471 | 1.751 | 0.312 | 0.678 | 1.751 |
| 0.506 | 0.593 | 1.751 | −1.354 | 0.475 | 1.751 | 0.373 | 0.689 | 1.751 |
| 0.451 | 0.570 | 1.751 | −1.354 | 0.479 | 1.751 | 0.431 | 0.700 | 1.751 |
| 0.394 | 0.546 | 1.751 | −1.352 | 0.482 | 1.751 | 0.487 | 0.711 | 1.751 |
| 0.334 | 0.521 | 1.751 | −1.349 | 0.485 | 1.751 | 0.541 | 0.722 | 1.751 |
| 0.272 | 0.497 | 1.751 | −1.345 | 0.489 | 1.751 | 0.593 | 0.733 | 1.751 |
| 0.207 | 0.472 | 1.751 | −1.338 | 0.491 | 1.751 | 0.642 | 0.744 | 1.751 |
| 0.140 | 0.448 | 1.751 | −1.330 | 0.494 | 1.751 | 0.686 | 0.754 | 1.751 |
| 0.072 | 0.424 | 1.751 | −1.318 | 0.497 | 1.751 | 0.726 | 0.763 | 1.751 |
| 0.004 | 0.403 | 1.751 | −1.303 | 0.499 | 1.751 | 0.782 | 0.771 | 1.751 |
| −0.064 | 0.383 | 1.751 | −1.286 | 0.502 | 1.751 | 0.795 | 0.779 | 1.751 |
| −0.133 | 0.364 | 1.751 | −1.264 | 0.504 | 1.751 | 0.824 | 0.785 | 1.751 |
| −0.203 | 0.348 | 1.751 | −1.239 | 0.505 | 1.751 | 0.847 | 0.790 | 1.751 |
| −0.274 | 0.334 | 1.751 | −1.209 | 0.507 | 1.751 | 0.864 | 0.795 | 1.751 |
| −0.344 | 0.322 | 1.751 | −1.175 | 0.508 | 1.751 | 0.878 | 0.798 | 1.751 |
| −0.415 | 0.313 | 1.751 | −1.136 | 0.510 | 1.751 | 0.888 | 0.795 | 1.751 |
| −0.487 | 0.306 | 1.751 | −1.093 | 0.511 | 1.751 | 0.892 | 0.791 | 1.751 |
| −0.558 | 0.302 | 1.751 | −1.045 | 0.513 | 1.751 | 0.894 | 0.788 | 1.751 |
| −0.630 | 0.301 | 1.751 | −0.992 | 0.515 | 1.751 | 0.895 | 0.786 | 1.751 |
| −0.699 | 0.301 | 1.751 | −0.938 | 0.517 | 1.751 | 0.895 | 0.785 | 1.751 |
| −0.766 | 0.304 | 1.751 | −0.881 | 0.520 | 1.751 | 0.895 | 0.785 | 1.751 |
| −0.830 | 0.310 | 1.751 | −0.821 | 0.524 | 1.751 | | | |
| −0.891 | 0.317 | 1.751 | −0.760 | 0.529 | 1.751 | | | |
| 0.825 | 0.854 | 2.101 | −0.996 | 0.412 | 2.101 | −0.745 | 0.610 | 2.101 |
| 0.825 | 0.853 | 2.101 | −1.051 | 0.422 | 2.101 | −0.680 | 0.616 | 2.101 |
| 0.825 | 0.851 | 2.101 | −1.103 | 0.434 | 2.101 | −0.613 | 0.623 | 2.101 |
| 0.826 | 0.847 | 2.101 | −1.151 | 0.446 | 2.101 | −0.545 | 0.631 | 2.101 |
| 0.824 | 0.841 | 2.101 | −1.194 | 0.458 | 2.101 | −0.478 | 0.639 | 2.101 |
| 0.818 | 0.833 | 2.101 | −1.232 | 0.471 | 2.101 | −0.411 | 0.648 | 2.101 |
| 0.805 | 0.827 | 2.101 | −1.265 | 0.483 | 2.101 | −0.344 | 0.657 | 2.101 |
| 0.788 | 0.819 | 2.101 | −1.294 | 0.494 | 2.101 | −0.277 | 0.666 | 2.101 |
| 0.766 | 0.810 | 2.101 | −1.318 | 0.505 | 2.101 | −0.210 | 0.675 | 2.101 |
| 0.738 | 0.797 | 2.101 | −1.338 | 0.514 | 2.101 | −0.144 | 0.685 | 2.101 |
| 0.706 | 0.783 | 2.101 | −1.354 | 0.523 | 2.101 | −0.077 | 0.695 | 2.101 |
| 0.672 | 0.767 | 2.101 | −1.367 | 0.531 | 2.101 | −0.010 | 0.705 | 2.101 |
| 0.633 | 0.750 | 2.101 | −1.377 | 0.538 | 2.101 | 0.057 | 0.716 | 2.101 |
| 0.590 | 0.732 | 2.101 | −1.385 | 0.544 | 2.101 | 0.124 | 0.727 | 2.101 |
| 0.542 | 0.711 | 2.101 | −1.390 | 0.550 | 2.101 | 0.188 | 0.738 | 2.101 |
| 0.493 | 0.690 | 2.101 | −1.393 | 0.555 | 2.101 | 0.250 | 0.749 | 2.101 |
| 0.441 | 0.667 | 2.101 | −1.394 | 0.559 | 2.101 | 0.310 | 0.760 | 2.101 |
| 0.386 | 0.645 | 2.101 | −1.394 | 0.563 | 2.101 | 0.367 | 0.771 | 2.101 |
| 0.330 | 0.621 | 2.101 | −1.393 | 0.566 | 2.101 | 0.423 | 0.782 | 2.101 |
| 0.271 | 0.598 | 2.101 | −1.390 | 0.569 | 2.101 | 0.476 | 0.793 | 2.101 |
| 0.210 | 0.574 | 2.101 | −1.385 | 0.572 | 2.101 | 0.526 | 0.803 | 2.101 |
| 0.146 | 0.550 | 2.101 | −1.379 | 0.575 | 2.101 | 0.575 | 0.814 | 2.101 |
| 0.079 | 0.527 | 2.101 | −1.370 | 0.578 | 2.101 | 0.619 | 0.824 | 2.101 |
| 0.012 | 0.504 | 2.101 | −1.359 | 0.580 | 2.101 | 0.658 | 0.833 | 2.101 |
| −0.055 | 0.483 | 2.101 | −1.344 | 0.582 | 2.101 | 0.694 | 0.841 | 2.101 |
| −0.123 | 0.464 | 2.101 | −1.327 | 0.584 | 2.101 | 0.727 | 0.848 | 2.101 |
| −0.191 | 0.446 | 2.101 | −1.306 | 0.586 | 2.101 | 0.755 | 0.855 | 2.101 |
| −0.260 | 0.431 | 2.101 | −1.281 | 0.587 | 2.101 | 0.777 | 0.860 | 2.101 |
| −0.329 | 0.417 | 2.101 | −1.251 | 0.588 | 2.101 | 0.795 | 0.865 | 2.101 |
| −0.399 | 0.406 | 2.101 | −1.218 | 0.589 | 2.101 | 0.808 | 0.867 | 2.101 |
| −0.469 | 0.398 | 2.101 | −1.179 | 0.590 | 2.101 | 0.817 | 0.864 | 2.101 |
| −0.539 | 0.392 | 2.101 | −1.137 | 0.591 | 2.101 | 0.821 | 0.860 | 2.101 |
| −0.610 | 0.388 | 2.101 | −1.089 | 0.592 | 2.101 | 0.823 | 0.857 | 2.101 |
| −0.681 | 0.386 | 2.101 | −1.037 | 0.593 | 2.101 | 0.824 | 0.856 | 2.101 |
| −0.749 | 0.388 | 2.101 | −0.983 | 0.595 | 2.101 | 0.825 | 0.855 | 2.101 |
| −0.815 | 0.391 | 2.101 | −0.927 | 0.598 | 2.101 | 0.825 | 0.854 | 2.101 |
| −0.878 | 0.396 | 2.101 | −0.869 | 0.601 | 2.101 | | | |
| −0.938 | 0.403 | 2.101 | −0.808 | 0.605 | 2.101 | | | |
| 0.767 | 0.892 | 2.801 | −1.004 | 0.489 | 2.801 | −0.759 | 0.668 | 2.801 |
| 0.767 | 0.891 | 2.801 | −1.057 | 0.500 | 2.801 | −0.696 | 0.673 | 2.801 |
| 0.767 | 0.889 | 2.801 | −1.108 | 0.511 | 2.801 | −0.631 | 0.679 | 2.801 |
| 0.767 | 0.886 | 2.801 | −1.154 | 0.523 | 2.801 | −0.565 | 0.686 | 2.801 |
| 0.766 | 0.880 | 2.801 | −1.196 | 0.535 | 2.801 | −0.500 | 0.693 | 2.801 |
| 0.760 | 0.872 | 2.801 | −1.233 | 0.547 | 2.801 | −0.435 | 0.701 | 2.801 |
| 0.748 | 0.866 | 2.801 | −1.265 | 0.558 | 2.801 | −0.370 | 0.709 | 2.801 |
| 0.731 | 0.859 | 2.801 | −1.293 | 0.569 | 2.801 | −0.305 | 0.717 | 2.801 |
| 0.710 | 0.850 | 2.801 | −1.316 | 0.579 | 2.801 | −0.240 | 0.726 | 2.801 |
| 0.683 | 0.838 | 2.801 | −1.335 | 0.588 | 2.801 | −0.175 | 0.735 | 2.801 |
| 0.651 | 0.824 | 2.801 | −1.351 | 0.596 | 2.801 | −0.110 | 0.744 | 2.801 |
| 0.618 | 0.810 | 2.801 | −1.364 | 0.604 | 2.801 | −0.045 | 0.754 | 2.801 |
| 0.580 | 0.794 | 2.801 | −1.374 | 0.611 | 2.801 | 0.020 | 0.764 | 2.801 |
| 0.538 | 0.777 | 2.801 | −1.381 | 0.616 | 2.801 | 0.085 | 0.774 | 2.801 |

TABLE 13S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.491 | 0.758 | 2.801 | −1.386 | 0.621 | 2.801 | 0.148 | 0.784 | 2.801 |
| 0.443 | 0.738 | 2.801 | −1.389 | 0.626 | 2.801 | 0.208 | 0.794 | 2.801 |
| 0.392 | 0.717 | 2.801 | −1.391 | 0.631 | 2.801 | 0.266 | 0.805 | 2.801 |
| 0.339 | 0.696 | 2.801 | −1.391 | 0.634 | 2.801 | 0.322 | 0.815 | 2.801 |
| 0.284 | 0.674 | 2.801 | −1.389 | 0.637 | 2.801 | 0.376 | 0.825 | 2.801 |
| 0.227 | 0.652 | 2.801 | −1.386 | 0.640 | 2.801 | 0.427 | 0.835 | 2.801 |
| 0.167 | 0.630 | 2.801 | −1.382 | 0.643 | 2.801 | 0.477 | 0.845 | 2.801 |
| 0.104 | 0.608 | 2.801 | −1.376 | 0.645 | 2.801 | 0.524 | 0.855 | 2.801 |
| 0.040 | 0.587 | 2.801 | −1.367 | 0.648 | 2.801 | 0.567 | 0.865 | 2.801 |
| −0.025 | 0.566 | 2.801 | −1.356 | 0.650 | 2.801 | 0.605 | 0.873 | 2.801 |
| −0.091 | 0.547 | 2.801 | −1.342 | 0.651 | 2.801 | 0.639 | 0.881 | 2.801 |
| −0.157 | 0.529 | 2.801 | −1.325 | 0.653 | 2.801 | 0.671 | 0.888 | 2.801 |
| −0.223 | 0.513 | 2.801 | −1.304 | 0.654 | 2.801 | 0.699 | 0.894 | 2.801 |
| −0.290 | 0.499 | 2.801 | −1.280 | 0.654 | 2.801 | 0.720 | 0.899 | 2.801 |
| −0.358 | 0.487 | 2.801 | −1.251 | 0.655 | 2.801 | 0.737 | 0.903 | 2.801 |
| −0.425 | 0.478 | 2.801 | −1.219 | 0.655 | 2.801 | 0.750 | 0.905 | 2.801 |
| −0.493 | 0.470 | 2.801 | −1.181 | 0.655 | 2.801 | 0.759 | 0.902 | 2.801 |
| −0.562 | 0.465 | 2.801 | −1.140 | 0.655 | 2.801 | 0.763 | 0.898 | 2.801 |
| −0.630 | 0.463 | 2.801 | −1.094 | 0.656 | 2.801 | 0.765 | 0.895 | 2.801 |
| −0.699 | 0.462 | 2.801 | −1.043 | 0.656 | 2.801 | 0.766 | 0.894 | 2.801 |
| −0.765 | 0.464 | 2.801 | −0.991 | 0.657 | 2.801 | 0.766 | 0.893 | 2.801 |
| −0.828 | 0.468 | 2.801 | −0.936 | 0.659 | 2.801 | 0.766 | 0.893 | 2.801 |
| −0.890 | 0.473 | 2.801 | −0.879 | 0.661 | 2.801 | | | |
| −0.948 | 0.481 | 2.801 | −0.820 | 0.664 | 2.801 | | | |
| 0.833 | 0.786 | 3.502 | −0.893 | 0.429 | 3.502 | −0.655 | 0.582 | 3.502 |
| 0.833 | 0.785 | 3.502 | −0.945 | 0.438 | 3.502 | −0.593 | 0.586 | 3.502 |
| 0.833 | 0.783 | 3.502 | −0.995 | 0.449 | 3.502 | −0.530 | 0.590 | 3.502 |
| 0.833 | 0.779 | 3.502 | −1.039 | 0.460 | 3.502 | −0.466 | 0.596 | 3.502 |
| 0.832 | 0.774 | 3.502 | −1.080 | 0.471 | 3.502 | −0.402 | 0.601 | 3.502 |
| 0.827 | 0.766 | 3.502 | −1.116 | 0.482 | 3.502 | −0.339 | 0.608 | 3.502 |
| 0.815 | 0.760 | 3.502 | −1.147 | 0.493 | 3.502 | −0.275 | 0.615 | 3.502 |
| 0.798 | 0.753 | 3.502 | −1.174 | 0.503 | 3.502 | −0.211 | 0.622 | 3.502 |
| 0.778 | 0.745 | 3.502 | −1.197 | 0.512 | 3.502 | −0.148 | 0.630 | 3.502 |
| 0.751 | 0.734 | 3.502 | −1.216 | 0.520 | 3.502 | −0.085 | 0.638 | 3.502 |
| 0.720 | 0.721 | 3.502 | −1.231 | 0.528 | 3.502 | −0.021 | 0.646 | 3.502 |
| 0.688 | 0.708 | 3.502 | −1.244 | 0.535 | 3.502 | 0.042 | 0.655 | 3.502 |
| 0.651 | 0.694 | 3.502 | −1.254 | 0.541 | 3.502 | 0.105 | 0.664 | 3.502 |
| 0.609 | 0.678 | 3.502 | −1.261 | 0.547 | 3.502 | 0.169 | 0.673 | 3.502 |
| 0.564 | 0.660 | 3.502 | −1.266 | 0.551 | 3.502 | 0.230 | 0.683 | 3.502 |
| 0.517 | 0.642 | 3.502 | −1.269 | 0.556 | 3.502 | 0.289 | 0.693 | 3.502 |
| 0.467 | 0.623 | 3.502 | −1.271 | 0.560 | 3.502 | 0.345 | 0.702 | 3.502 |
| 0.415 | 0.604 | 3.502 | −1.271 | 0.563 | 3.502 | 0.400 | 0.712 | 3.502 |
| 0.361 | 0.584 | 3.502 | −1.269 | 0.566 | 3.502 | 0.452 | 0.722 | 3.502 |
| 0.305 | 0.565 | 3.502 | −1.266 | 0.569 | 3.502 | 0.502 | 0.731 | 3.502 |
| 0.246 | 0.545 | 3.502 | −1.262 | 0.572 | 3.502 | 0.550 | 0.741 | 3.502 |
| 0.185 | 0.525 | 3.502 | −1.256 | 0.574 | 3.502 | 0.596 | 0.751 | 3.502 |
| 0.122 | 0.506 | 3.502 | −1.247 | 0.576 | 3.502 | 0.638 | 0.760 | 3.502 |
| 0.058 | 0.488 | 3.502 | −1.236 | 0.577 | 3.502 | 0.676 | 0.768 | 3.502 |
| −0.006 | 0.471 | 3.502 | −1.223 | 0.578 | 3.502 | 0.709 | 0.775 | 3.502 |
| −0.071 | 0.456 | 3.502 | −1.206 | 0.579 | 3.502 | 0.740 | 0.782 | 3.502 |
| −0.136 | 0.442 | 3.502 | −1.186 | 0.579 | 3.502 | 0.767 | 0.789 | 3.502 |
| −0.201 | 0.430 | 3.502 | −1.162 | 0.579 | 3.502 | 0.788 | 0.793 | 3.502 |
| −0.266 | 0.421 | 3.502 | −1.134 | 0.578 | 3.502 | 0.804 | 0.797 | 3.502 |
| −0.332 | 0.413 | 3.502 | −1.103 | 0.578 | 3.502 | 0.817 | 0.799 | 3.502 |
| −0.398 | 0.407 | 3.502 | −1.066 | 0.577 | 3.502 | 0.826 | 0.795 | 3.502 |
| −0.464 | 0.403 | 3.502 | −1.026 | 0.576 | 3.502 | 0.830 | 0.792 | 3.502 |
| −0.531 | 0.401 | 3.502 | −0.981 | 0.576 | 3.502 | 0.831 | 0.789 | 3.502 |
| −0.597 | 0.401 | 3.502 | −0.932 | 0.575 | 3.502 | 0.832 | 0.787 | 3.502 |
| −0.661 | 0.403 | 3.502 | −0.881 | 0.575 | 3.502 | 0.832 | 0.786 | 3.502 |
| −0.722 | 0.407 | 3.502 | −0.827 | 0.576 | 3.502 | 0.833 | 0.786 | 3.502 |
| −0.782 | 0.413 | 3.502 | −0.772 | 0.577 | 3.502 | | | |
| −0.839 | 0.420 | 3.502 | −0.715 | 0.579 | 3.502 | | | |
| 1.062 | 0.475 | 4.552 | −0.630 | 0.219 | 4.552 | −0.397 | 0.321 | 4.552 |
| 1.062 | 0.474 | 4.552 | −0.680 | 0.229 | 4.552 | −0.336 | 0.321 | 4.552 |
| 1.062 | 0.473 | 4.552 | −0.728 | 0.239 | 4.552 | −0.274 | 0.322 | 4.552 |
| 1.062 | 0.469 | 4.552 | −0.772 | 0.250 | 4.552 | −0.211 | 0.324 | 4.552 |
| 1.061 | 0.464 | 4.552 | −0.811 | 0.261 | 4.552 | −0.149 | 0.326 | 4.552 |
| 1.056 | 0.456 | 4.552 | −0.846 | 0.271 | 4.552 | −0.086 | 0.330 | 4.552 |
| 1.044 | 0.450 | 4.552 | −0.877 | 0.281 | 4.552 | −0.024 | 0.333 | 4.552 |
| 1.028 | 0.445 | 4.552 | −0.903 | 0.290 | 4.552 | 0.038 | 0.338 | 4.552 |
| 1.008 | 0.438 | 4.552 | −0.925 | 0.298 | 4.552 | 0.101 | 0.343 | 4.552 |
| 0.981 | 0.428 | 4.552 | −0.944 | 0.305 | 4.552 | 0.163 | 0.348 | 4.552 |
| 0.951 | 0.418 | 4.552 | −0.960 | 0.312 | 4.552 | 0.225 | 0.354 | 4.552 |
| 0.919 | 0.407 | 4.552 | −0.972 | 0.318 | 4.552 | 0.287 | 0.360 | 4.552 |
| 0.882 | 0.394 | 4.552 | −0.982 | 0.323 | 4.552 | 0.349 | 0.367 | 4.552 |
| 0.841 | 0.381 | 4.552 | −0.989 | 0.328 | 4.552 | 0.411 | 0.375 | 4.552 |
| 0.796 | 0.367 | 4.552 | −0.994 | 0.333 | 4.552 | 0.471 | 0.383 | 4.552 |

TABLE 13S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.749 | 0.352 | 4.552 | −0.997 | 0.337 | 4.552 | 0.529 | 0.391 | 4.552 |
| 0.700 | 0.337 | 4.552 | −0.998 | 0.341 | 4.552 | 0.584 | 0.399 | 4.552 |
| 0.649 | 0.321 | 4.552 | −0.998 | 0.344 | 4.552 | 0.638 | 0.408 | 4.552 |
| 0.595 | 0.306 | 4.552 | −0.997 | 0.347 | 4.552 | 0.689 | 0.416 | 4.552 |
| 0.540 | 0.290 | 4.552 | −0.994 | 0.350 | 4.552 | 0.739 | 0.425 | 4.552 |
| 0.482 | 0.275 | 4.552 | −0.989 | 0.352 | 4.552 | 0.786 | 0.434 | 4.552 |
| 0.421 | 0.260 | 4.552 | −0.983 | 0.354 | 4.552 | 0.831 | 0.443 | 4.552 |
| 0.359 | 0.246 | 4.552 | −0.975 | 0.355 | 4.552 | 0.871 | 0.451 | 4.552 |
| 0.296 | 0.233 | 4.552 | −0.964 | 0.356 | 4.552 | 0.908 | 0.459 | 4.552 |
| 0.233 | 0.221 | 4.552 | −0.950 | 0.355 | 4.552 | 0.941 | 0.466 | 4.552 |
| 0.169 | 0.211 | 4.552 | −0.934 | 0.354 | 4.552 | 0.971 | 0.473 | 4.552 |
| 0.106 | 0.202 | 4.552 | −0.915 | 0.353 | 4.552 | 0.998 | 0.479 | 4.552 |
| 0.042 | 0.194 | 4.552 | −0.892 | 0.351 | 4.552 | 1.018 | 0.484 | 4.552 |
| −0.022 | 0.188 | 4.552 | −0.865 | 0.348 | 4.552 | 1.034 | 0.487 | 4.552 |
| −0.086 | 0.184 | 4.552 | −0.834 | 0.345 | 4.552 | 1.047 | 0.489 | 4.552 |
| −0.150 | 0.182 | 4.552 | −0.798 | 0.342 | 4.552 | 1.055 | 0.485 | 4.552 |
| −0.215 | 0.181 | 4.552 | −0.759 | 0.338 | 4.552 | 1.059 | 0.481 | 4.552 |
| −0.279 | 0.182 | 4.552 | −0.715 | 0.335 | 4.552 | 1.060 | 0.478 | 4.552 |
| −0.343 | 0.185 | 4.552 | −0.667 | 0.331 | 4.552 | 1.061 | 0.477 | 4.552 |
| −0.405 | 0.189 | 4.552 | −0.617 | 0.328 | 4.552 | 1.061 | 0.476 | 4.552 |
| −0.465 | 0.195 | 4.552 | −0.565 | 0.326 | 4.552 | 1.062 | 0.476 | 4.552 |
| −0.522 | 0.202 | 4.552 | −0.511 | 0.324 | 4.552 | | | |
| −0.577 | 0.210 | 4.552 | −0.455 | 0.322 | 4.552 | | | |
| 1.142 | 0.350 | 4.903 | −0.541 | 0.151 | 4.903 | −0.307 | 0.231 | 4.903 |
| 1.142 | 0.349 | 4.903 | −0.590 | 0.163 | 4.903 | −0.247 | 0.227 | 4.903 |
| 1.143 | 0.347 | 4.903 | −0.637 | 0.176 | 4.903 | −0.185 | 0.225 | 4.903 |
| 1.143 | 0.344 | 4.903 | −0.680 | 0.188 | 4.903 | −0.123 | 0.223 | 4.903 |
| 1.142 | 0.339 | 4.903 | −0.719 | 0.200 | 4.903 | −0.061 | 0.223 | 4.903 |
| 1.136 | 0.331 | 4.903 | −0.753 | 0.212 | 4.903 | 0.001 | 0.223 | 4.903 |
| 1.125 | 0.325 | 4.903 | −0.783 | 0.222 | 4.903 | 0.063 | 0.224 | 4.903 |
| 1.109 | 0.319 | 4.903 | −0.809 | 0.232 | 4.903 | 0.125 | 0.226 | 4.903 |
| 1.089 | 0.312 | 4.903 | −0.831 | 0.241 | 4.903 | 0.187 | 0.229 | 4.903 |
| 1.063 | 0.303 | 4.903 | −0.849 | 0.249 | 4.903 | 0.249 | 0.232 | 4.903 |
| 1.033 | 0.293 | 4.903 | −0.865 | 0.256 | 4.903 | 0.311 | 0.236 | 4.903 |
| 1.000 | 0.282 | 4.903 | −0.877 | 0.262 | 4.903 | 0.372 | 0.241 | 4.903 |
| 0.964 | 0.270 | 4.903 | −0.887 | 0.268 | 4.903 | 0.434 | 0.246 | 4.903 |
| 0.923 | 0.257 | 4.903 | −0.893 | 0.273 | 4.903 | 0.496 | 0.253 | 4.903 |
| 0.879 | 0.243 | 4.903 | −0.898 | 0.278 | 4.903 | 0.555 | 0.259 | 4.903 |
| 0.832 | 0.228 | 4.903 | −0.901 | 0.282 | 4.903 | 0.613 | 0.267 | 4.903 |
| 0.783 | 0.214 | 4.903 | −0.902 | 0.286 | 4.903 | 0.668 | 0.274 | 4.903 |
| 0.732 | 0.199 | 4.903 | −0.902 | 0.290 | 4.903 | 0.722 | 0.282 | 4.903 |
| 0.678 | 0.185 | 4.903 | −0.900 | 0.292 | 4.903 | 0.773 | 0.291 | 4.903 |
| 0.622 | 0.171 | 4.903 | −0.897 | 0.295 | 4.903 | 0.821 | 0.299 | 4.903 |
| 0.564 | 0.158 | 4.903 | −0.892 | 0.297 | 4.903 | 0.868 | 0.308 | 4.903 |
| 0.504 | 0.145 | 4.903 | −0.886 | 0.299 | 4.903 | 0.913 | 0.317 | 4.903 |
| 0.441 | 0.133 | 4.903 | −0.878 | 0.299 | 4.903 | 0.953 | 0.325 | 4.903 |
| 0.379 | 0.122 | 4.903 | −0.867 | 0.299 | 4.903 | 0.990 | 0.333 | 4.903 |
| 0.316 | 0.113 | 4.903 | −0.854 | 0.298 | 4.903 | 1.022 | 0.340 | 4.903 |
| 0.252 | 0.105 | 4.903 | −0.838 | 0.296 | 4.903 | 1.052 | 0.347 | 4.903 |
| 0.189 | 0.099 | 4.903 | −0.818 | 0.293 | 4.903 | 1.079 | 0.353 | 4.903 |
| 0.125 | 0.094 | 4.903 | −0.796 | 0.289 | 4.903 | 1.099 | 0.358 | 4.903 |
| 0.061 | 0.091 | 4.903 | −0.769 | 0.285 | 4.903 | 1.115 | 0.362 | 4.903 |
| −0.003 | 0.090 | 4.903 | −0.739 | 0.280 | 4.903 | 1.127 | 0.363 | 4.903 |
| −0.067 | 0.091 | 4.903 | −0.704 | 0.275 | 4.903 | 1.136 | 0.360 | 4.903 |
| −0.130 | 0.094 | 4.903 | −0.665 | 0.269 | 4.903 | 1.139 | 0.356 | 4.903 |
| −0.194 | 0.098 | 4.903 | −0.622 | 0.263 | 4.903 | 1.141 | 0.353 | 4.903 |
| −0.258 | 0.104 | 4.903 | −0.575 | 0.256 | 4.903 | 1.141 | 0.352 | 4.903 |
| −0.319 | 0.111 | 4.903 | −0.525 | 0.250 | 4.903 | 1.142 | 0.351 | 4.903 |
| −0.378 | 0.119 | 4.903 | −0.474 | 0.245 | 4.903 | 1.142 | 0.350 | 4.903 |
| −0.434 | 0.129 | 4.903 | −0.420 | 0.239 | 4.903 | | | |
| −0.489 | 0.140 | 4.903 | −0.365 | 0.235 | 4.903 | | | |
| 1.256 | 0.001 | 5.515 | −0.413 | 0.113 | 5.515 | −0.178 | 0.100 | 5.515 |
| 1.257 | 0.000 | 5.515 | −0.457 | 0.139 | 5.515 | −0.122 | 0.080 | 5.515 |
| 1.257 | −0.002 | 5.515 | −0.499 | 0.165 | 5.515 | −0.063 | 0.060 | 5.515 |
| 1.257 | −0.005 | 5.515 | −0.537 | 0.190 | 5.515 | −0.003 | 0.043 | 5.515 |
| 1.256 | −0.010 | 5.515 | −0.570 | 0.213 | 5.515 | 0.056 | 0.027 | 5.515 |
| 1.250 | −0.018 | 5.515 | −0.600 | 0.234 | 5.515 | 0.116 | 0.013 | 5.515 |
| 1.239 | −0.023 | 5.515 | −0.626 | 0.253 | 5.515 | 0.176 | 0.000 | 5.515 |
| 1.222 | −0.029 | 5.515 | −0.649 | 0.269 | 5.515 | 0.237 | −0.011 | 5.515 |
| 1.202 | −0.035 | 5.515 | −0.668 | 0.284 | 5.515 | 0.298 | −0.020 | 5.515 |
| 1.175 | −0.043 | 5.515 | −0.683 | 0.296 | 5.515 | 0.358 | −0.028 | 5.515 |
| 1.144 | −0.052 | 5.515 | −0.697 | 0.307 | 5.515 | 0.420 | −0.034 | 5.515 |
| 1.111 | −0.061 | 5.515 | −0.707 | 0.316 | 5.515 | 0.481 | −0.039 | 5.515 |
| 1.073 | −0.072 | 5.515 | −0.715 | 0.324 | 5.515 | 0.542 | −0.043 | 5.515 |
| 1.032 | −0.082 | 5.515 | −0.720 | 0.331 | 5.515 | 0.604 | −0.045 | 5.515 |
| 0.986 | −0.094 | 5.515 | −0.723 | 0.337 | 5.515 | 0.664 | −0.045 | 5.515 |
| 0.938 | −0.105 | 5.515 | −0.725 | 0.342 | 5.515 | 0.722 | −0.045 | 5.515 |

TABLE 13S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.887 | −0.115 | 5.515 | −0.725 | 0.346 | 5.515 | 0.778 | −0.043 | 5.515 |
| 0.834 | −0.125 | 5.515 | −0.724 | 0.349 | 5.515 | 0.832 | −0.040 | 5.515 |
| 0.779 | −0.134 | 5.515 | −0.721 | 0.351 | 5.515 | 0.883 | −0.036 | 5.515 |
| 0.722 | −0.142 | 5.515 | −0.717 | 0.353 | 5.515 | 0.933 | −0.031 | 5.515 |
| 0.662 | −0.148 | 5.515 | −0.712 | 0.353 | 5.515 | 0.980 | −0.026 | 5.515 |
| 0.600 | −0.152 | 5.515 | −0.706 | 0.352 | 5.515 | 1.025 | −0.020 | 5.515 |
| 0.536 | −0.155 | 5.515 | −0.698 | 0.350 | 5.515 | 1.066 | −0.015 | 5.515 |
| 0.471 | −0.154 | 5.515 | −0.688 | 0.347 | 5.515 | 1.103 | −0.009 | 5.515 |
| 0.407 | −0.152 | 5.515 | −0.676 | 0.341 | 5.515 | 1.136 | −0.003 | 5.515 |
| 0.343 | −0.146 | 5.515 | −0.661 | 0.333 | 5.515 | 1.166 | 0.002 | 5.515 |
| 0.279 | −0.138 | 5.515 | −0.644 | 0.324 | 5.515 | 1.193 | 0.007 | 5.515 |
| 0.215 | −0.128 | 5.515 | −0.624 | 0.312 | 5.515 | 1.213 | 0.011 | 5.515 |
| 0.152 | −0.115 | 5.515 | −0.601 | 0.299 | 5.515 | 1.230 | 0.014 | 5.515 |
| 0.090 | −0.099 | 5.515 | −0.574 | 0.284 | 5.515 | 1.242 | 0.015 | 5.515 |
| 0.028 | −0.082 | 5.515 | −0.543 | 0.267 | 5.515 | 1.250 | 0.011 | 5.515 |
| −0.033 | −0.062 | 5.515 | −0.508 | 0.248 | 5.515 | 1.254 | 0.007 | 5.515 |
| −0.094 | −0.040 | 5.515 | −0.469 | 0.228 | 5.515 | 1.255 | 0.004 | 5.515 |
| −0.154 | −0.016 | 5.515 | −0.426 | 0.207 | 5.515 | 1.256 | 0.002 | 5.515 |
| −0.211 | 0.008 | 5.515 | −0.381 | 0.185 | 5.515 | 1.256 | 0.002 | 5.515 |
| −0.265 | 0.034 | 5.515 | −0.334 | 0.164 | 5.515 | 1.256 | 0.001 | 5.515 |
| −0.317 | 0.060 | 5.515 | −0.285 | 0.142 | 5.515 | | | |
| −0.366 | 0.086 | 5.515 | −0.233 | 0.121 | 5.515 | | | |

The coordinate values given in TABLE 14S below provide the nominal profile envelope for an exemplary fourteenth stage stator.

TABLE 14S

| X-LOC | Y-LOC | Z-LOC | X-LOC | Y-LOC | Z-LOC | X-LOC | Y-LOC | Z-LOC |
|---|---|---|---|---|---|---|---|---|
| 1.416 | 0.180 | 0.000 | −0.880 | −0.166 | 0.000 | −0.520 | 0.047 | 0.000 |
| 1.416 | 0.178 | 0.000 | −0.944 | −0.137 | 0.000 | −0.440 | 0.044 | 0.000 |
| 1.416 | 0.176 | 0.000 | −1.004 | −0.107 | 0.000 | −0.357 | 0.042 | 0.000 |
| 1.416 | 0.171 | 0.000 | −1.058 | −0.078 | 0.000 | −0.275 | 0.042 | 0.000 |
| 1.413 | 0.165 | 0.000 | −1.106 | −0.049 | 0.000 | −0.192 | 0.042 | 0.000 |
| 1.401 | 0.158 | 0.000 | −1.148 | −0.022 | 0.000 | −0.110 | 0.044 | 0.000 |
| 1.385 | 0.151 | 0.000 | −1.184 | 0.004 | 0.000 | −0.028 | 0.047 | 0.000 |
| 1.363 | 0.142 | 0.000 | −1.214 | 0.028 | 0.000 | 0.055 | 0.051 | 0.000 |
| 1.336 | 0.131 | 0.000 | −1.239 | 0.049 | 0.000 | 0.137 | 0.055 | 0.000 |
| 1.301 | 0.117 | 0.000 | −1.259 | 0.067 | 0.000 | 0.219 | 0.060 | 0.000 |
| 1.260 | 0.100 | 0.000 | −1.276 | 0.084 | 0.000 | 0.302 | 0.066 | 0.000 |
| 1.216 | 0.083 | 0.000 | −1.289 | 0.098 | 0.000 | 0.384 | 0.072 | 0.000 |
| 1.166 | 0.063 | 0.000 | −1.298 | 0.110 | 0.000 | 0.466 | 0.078 | 0.000 |
| 1.111 | 0.042 | 0.000 | −1.305 | 0.120 | 0.000 | 0.548 | 0.085 | 0.000 |
| 1.051 | 0.019 | 0.000 | −1.310 | 0.128 | 0.000 | 0.627 | 0.091 | 0.000 |
| 0.987 | −0.005 | 0.000 | −1.312 | 0.135 | 0.000 | 0.704 | 0.099 | 0.000 |
| 0.921 | −0.029 | 0.000 | −1.313 | 0.141 | 0.000 | 0.778 | 0.106 | 0.000 |
| 0.851 | −0.054 | 0.000 | −1.311 | 0.145 | 0.000 | 0.849 | 0.113 | 0.000 |
| 0.779 | −0.079 | 0.000 | −1.309 | 0.148 | 0.000 | 0.917 | 0.121 | 0.000 |
| 0.704 | −0.105 | 0.000 | −1.304 | 0.151 | 0.000 | 0.983 | 0.129 | 0.000 |
| 0.625 | −0.130 | 0.000 | −1.297 | 0.153 | 0.000 | 1.046 | 0.137 | 0.000 |
| 0.543 | −0.155 | 0.000 | −1.289 | 0.154 | 0.000 | 1.106 | 0.146 | 0.000 |
| 0.458 | −0.179 | 0.000 | −1.278 | 0.155 | 0.000 | 1.160 | 0.154 | 0.000 |
| 0.373 | −0.202 | 0.000 | −1.264 | 0.154 | 0.000 | 1.209 | 0.161 | 0.000 |
| 0.287 | −0.223 | 0.000 | −1.246 | 0.152 | 0.000 | 1.253 | 0.168 | 0.000 |
| 0.201 | −0.242 | 0.000 | −1.224 | 0.150 | 0.000 | 1.293 | 0.174 | 0.000 |
| 0.114 | −0.259 | 0.000 | −1.199 | 0.146 | 0.000 | 1.329 | 0.180 | 0.000 |
| 0.027 | −0.273 | 0.000 | −1.169 | 0.141 | 0.000 | 1.356 | 0.185 | 0.000 |
| −0.061 | −0.283 | 0.000 | −1.134 | 0.134 | 0.000 | 1.378 | 0.189 | 0.000 |
| −0.149 | −0.290 | 0.000 | −1.093 | 0.126 | 0.000 | 1.394 | 0.191 | 0.000 |
| −0.237 | −0.293 | 0.000 | −1.047 | 0.117 | 0.000 | 1.406 | 0.191 | 0.000 |
| −0.326 | −0.292 | 0.000 | −0.996 | 0.107 | 0.000 | 1.412 | 0.187 | 0.000 |
| −0.413 | −0.285 | 0.000 | −0.939 | 0.096 | 0.000 | 1.414 | 0.184 | 0.000 |
| −0.500 | −0.274 | 0.000 | −0.876 | 0.086 | 0.000 | 1.415 | 0.182 | 0.000 |
| −0.583 | −0.259 | 0.000 | −0.811 | 0.076 | 0.000 | 1.416 | 0.181 | 0.000 |
| −0.663 | −0.240 | 0.000 | −0.742 | 0.067 | 0.000 | 1.416 | 0.180 | 0.000 |
| −0.740 | −0.218 | 0.000 | −0.671 | 0.059 | 0.000 | | | |
| −0.812 | −0.193 | 0.000 | −0.597 | 0.052 | 0.000 | | | |
| 1.196 | 0.379 | 0.511 | −0.842 | −0.072 | 0.511 | −0.544 | 0.178 | 0.511 |
| 1.196 | 0.378 | 0.511 | −0.902 | −0.055 | 0.511 | −0.472 | 0.182 | 0.511 |
| 1.196 | 0.376 | 0.511 | −0.959 | −0.037 | 0.511 | −0.398 | 0.187 | 0.511 |
| 1.196 | 0.372 | 0.511 | −1.011 | −0.018 | 0.511 | −0.323 | 0.192 | 0.511 |

TABLE 14S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.194 | 0.366 | 0.511 | −1.057 | 0.001 | 0.511 | −0.249 | 0.198 | 0.511 |
| 1.185 | 0.359 | 0.511 | −1.097 | 0.019 | 0.511 | −0.175 | 0.204 | 0.511 |
| 1.170 | 0.353 | 0.511 | −1.132 | 0.037 | 0.511 | −0.101 | 0.211 | 0.511 |
| 1.151 | 0.344 | 0.511 | −1.162 | 0.054 | 0.511 | −0.027 | 0.218 | 0.511 |
| 1.127 | 0.334 | 0.511 | −1.186 | 0.069 | 0.511 | 0.047 | 0.226 | 0.511 |
| 1.095 | 0.321 | 0.511 | −1.207 | 0.084 | 0.511 | 0.121 | 0.234 | 0.511 |
| 1.059 | 0.306 | 0.511 | −1.223 | 0.097 | 0.511 | 0.195 | 0.242 | 0.511 |
| 1.020 | 0.290 | 0.511 | −1.236 | 0.108 | 0.511 | 0.269 | 0.251 | 0.511 |
| 0.977 | 0.272 | 0.511 | −1.246 | 0.118 | 0.511 | 0.343 | 0.260 | 0.511 |
| 0.928 | 0.252 | 0.511 | −1.253 | 0.126 | 0.511 | 0.417 | 0.269 | 0.511 |
| 0.875 | 0.230 | 0.511 | −1.257 | 0.132 | 0.511 | 0.488 | 0.279 | 0.511 |
| 0.818 | 0.208 | 0.511 | −1.260 | 0.139 | 0.511 | 0.557 | 0.288 | 0.511 |
| 0.760 | 0.185 | 0.511 | −1.261 | 0.144 | 0.511 | 0.623 | 0.297 | 0.511 |
| 0.699 | 0.161 | 0.511 | −1.260 | 0.148 | 0.511 | 0.687 | 0.307 | 0.511 |
| 0.635 | 0.137 | 0.511 | −1.258 | 0.151 | 0.511 | 0.749 | 0.316 | 0.511 |
| 0.569 | 0.112 | 0.511 | −1.255 | 0.155 | 0.511 | 0.807 | 0.326 | 0.511 |
| 0.500 | 0.086 | 0.511 | −1.250 | 0.158 | 0.511 | 0.864 | 0.335 | 0.511 |
| 0.428 | 0.061 | 0.511 | −1.243 | 0.161 | 0.511 | 0.918 | 0.344 | 0.511 |
| 0.354 | 0.036 | 0.511 | −1.233 | 0.164 | 0.511 | 0.966 | 0.353 | 0.511 |
| 0.279 | 0.011 | 0.511 | −1.221 | 0.166 | 0.511 | 1.010 | 0.361 | 0.511 |
| 0.204 | −0.011 | 0.511 | −1.205 | 0.169 | 0.511 | 1.050 | 0.368 | 0.511 |
| 0.128 | −0.033 | 0.511 | −1.185 | 0.171 | 0.511 | 1.086 | 0.375 | 0.511 |
| 0.052 | −0.052 | 0.511 | −1.162 | 0.172 | 0.511 | 1.118 | 0.380 | 0.511 |
| −0.025 | −0.070 | 0.511 | −1.135 | 0.173 | 0.511 | 1.142 | 0.385 | 0.511 |
| −0.102 | −0.085 | 0.511 | −1.102 | 0.174 | 0.511 | 1.162 | 0.389 | 0.511 |
| −0.180 | −0.097 | 0.511 | −1.065 | 0.174 | 0.511 | 1.176 | 0.392 | 0.511 |
| −0.258 | −0.107 | 0.511 | −1.023 | 0.174 | 0.511 | 1.187 | 0.390 | 0.511 |
| −0.336 | −0.114 | 0.511 | −0.976 | 0.173 | 0.511 | 1.192 | 0.386 | 0.511 |
| −0.415 | −0.118 | 0.511 | −0.924 | 0.172 | 0.511 | 1.194 | 0.383 | 0.511 |
| −0.493 | −0.118 | 0.511 | −0.866 | 0.172 | 0.511 | 1.195 | 0.381 | 0.511 |
| −0.570 | −0.115 | 0.511 | −0.807 | 0.172 | 0.511 | 1.195 | 0.380 | 0.511 |
| −0.642 | −0.108 | 0.511 | −0.745 | 0.172 | 0.511 | 1.195 | 0.380 | 0.511 |
| −0.712 | −0.098 | 0.511 | −0.680 | 0.173 | 0.511 | | | |
| −0.778 | −0.086 | 0.511 | −0.613 | 0.175 | 0.511 | | | |
| 0.841 | 0.697 | 1.362 | −1.026 | 0.247 | 1.362 | −0.763 | 0.472 | 1.362 |
| 0.841 | 0.696 | 1.362 | −1.082 | 0.259 | 1.362 | −0.697 | 0.476 | 1.362 |
| 0.841 | 0.694 | 1.362 | −1.135 | 0.272 | 1.362 | −0.628 | 0.482 | 1.362 |
| 0.841 | 0.690 | 1.362 | −1.183 | 0.286 | 1.362 | −0.559 | 0.488 | 1.362 |
| 0.840 | 0.684 | 1.362 | −1.227 | 0.301 | 1.362 | −0.491 | 0.495 | 1.362 |
| 0.832 | 0.676 | 1.362 | −1.265 | 0.315 | 1.362 | −0.422 | 0.502 | 1.362 |
| 0.819 | 0.671 | 1.362 | −1.298 | 0.330 | 1.362 | −0.354 | 0.510 | 1.362 |
| 0.801 | 0.664 | 1.362 | −1.327 | 0.343 | 1.362 | −0.285 | 0.519 | 1.362 |
| 0.779 | 0.654 | 1.362 | −1.351 | 0.355 | 1.362 | −0.217 | 0.528 | 1.362 |
| 0.750 | 0.642 | 1.362 | −1.370 | 0.366 | 1.362 | −0.149 | 0.537 | 1.362 |
| 0.716 | 0.628 | 1.362 | −1.386 | 0.377 | 1.362 | −0.080 | 0.547 | 1.362 |
| 0.681 | 0.614 | 1.362 | −1.399 | 0.386 | 1.362 | −0.012 | 0.557 | 1.362 |
| 0.641 | 0.597 | 1.362 | −1.409 | 0.394 | 1.362 | 0.056 | 0.568 | 1.362 |
| 0.596 | 0.579 | 1.362 | −1.416 | 0.401 | 1.362 | 0.124 | 0.579 | 1.362 |
| 0.547 | 0.559 | 1.362 | −1.420 | 0.407 | 1.362 | 0.190 | 0.590 | 1.362 |
| 0.496 | 0.538 | 1.362 | −1.423 | 0.412 | 1.362 | 0.253 | 0.601 | 1.362 |
| 0.442 | 0.516 | 1.362 | −1.425 | 0.417 | 1.362 | 0.314 | 0.611 | 1.362 |
| 0.386 | 0.493 | 1.362 | −1.424 | 0.420 | 1.362 | 0.373 | 0.622 | 1.362 |
| 0.328 | 0.470 | 1.362 | −1.423 | 0.424 | 1.362 | 0.429 | 0.632 | 1.362 |
| 0.268 | 0.446 | 1.362 | −1.420 | 0.427 | 1.362 | 0.484 | 0.642 | 1.362 |
| 0.205 | 0.421 | 1.362 | −1.415 | 0.430 | 1.362 | 0.536 | 0.652 | 1.362 |
| 0.140 | 0.397 | 1.362 | −1.409 | 0.433 | 1.362 | 0.585 | 0.662 | 1.362 |
| 0.072 | 0.372 | 1.362 | −1.400 | 0.436 | 1.362 | 0.630 | 0.671 | 1.362 |
| 0.004 | 0.349 | 1.362 | −1.389 | 0.439 | 1.362 | 0.671 | 0.679 | 1.362 |
| −0.065 | 0.326 | 1.362 | −1.374 | 0.442 | 1.362 | 0.707 | 0.686 | 1.362 |
| −0.134 | 0.305 | 1.362 | −1.356 | 0.445 | 1.362 | 0.741 | 0.693 | 1.362 |
| −0.204 | 0.286 | 1.362 | −1.335 | 0.447 | 1.362 | 0.770 | 0.699 | 1.362 |
| −0.274 | 0.269 | 1.362 | −1.309 | 0.449 | 1.362 | 0.792 | 0.704 | 1.362 |
| −0.345 | 0.254 | 1.362 | −1.280 | 0.451 | 1.362 | 0.810 | 0.708 | 1.362 |
| −0.416 | 0.241 | 1.362 | −1.245 | 0.452 | 1.362 | 0.824 | 0.710 | 1.362 |
| −0.488 | 0.231 | 1.362 | −1.206 | 0.454 | 1.362 | 0.834 | 0.707 | 1.362 |
| −0.559 | 0.223 | 1.362 | −1.162 | 0.455 | 1.362 | 0.838 | 0.703 | 1.362 |
| −0.632 | 0.218 | 1.362 | −1.114 | 0.456 | 1.362 | 0.840 | 0.700 | 1.362 |
| −0.704 | 0.216 | 1.362 | −1.061 | 0.457 | 1.362 | 0.840 | 0.699 | 1.362 |
| −0.774 | 0.217 | 1.362 | −1.006 | 0.459 | 1.362 | 0.841 | 0.698 | 1.362 |
| −0.841 | 0.221 | 1.362 | −0.949 | 0.461 | 1.362 | 0.841 | 0.697 | 1.362 |
| −0.905 | 0.228 | 1.362 | −0.889 | 0.464 | 1.362 | | | |
| −0.967 | 0.236 | 1.362 | −0.827 | 0.467 | 1.362 | | | |
| 0.649 | 0.854 | 2.043 | −1.143 | 0.450 | 2.043 | −0.892 | 0.656 | 2.043 |
| 0.649 | 0.853 | 2.043 | −1.196 | 0.461 | 2.043 | −0.828 | 0.660 | 2.043 |
| 0.650 | 0.851 | 2.043 | −1.247 | 0.474 | 2.043 | −0.762 | 0.665 | 2.043 |
| 0.650 | 0.847 | 2.043 | −1.294 | 0.487 | 2.043 | −0.696 | 0.670 | 2.043 |
| 0.648 | 0.842 | 2.043 | −1.335 | 0.500 | 2.043 | −0.631 | 0.676 | 2.043 |

TABLE 14S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.641 | 0.834 | 2.043 | −1.372 | 0.513 | 2.043 | −0.565 | 0.683 | 2.043 |
| 0.628 | 0.829 | 2.043 | −1.404 | 0.526 | 2.043 | −0.499 | 0.690 | 2.043 |
| 0.611 | 0.822 | 2.043 | −1.432 | 0.538 | 2.043 | −0.433 | 0.697 | 2.043 |
| 0.590 | 0.813 | 2.043 | −1.455 | 0.549 | 2.043 | −0.368 | 0.705 | 2.043 |
| 0.562 | 0.802 | 2.043 | −1.474 | 0.559 | 2.043 | −0.302 | 0.713 | 2.043 |
| 0.530 | 0.790 | 2.043 | −1.489 | 0.568 | 2.043 | −0.236 | 0.722 | 2.043 |
| 0.496 | 0.776 | 2.043 | −1.502 | 0.577 | 2.043 | −0.171 | 0.731 | 2.043 |
| 0.457 | 0.761 | 2.043 | −1.511 | 0.584 | 2.043 | −0.106 | 0.740 | 2.043 |
| 0.414 | 0.745 | 2.043 | −1.518 | 0.591 | 2.043 | −0.040 | 0.750 | 2.043 |
| 0.367 | 0.727 | 2.043 | −1.523 | 0.596 | 2.043 | 0.023 | 0.759 | 2.043 |
| 0.317 | 0.708 | 2.043 | −1.526 | 0.601 | 2.043 | 0.084 | 0.769 | 2.043 |
| 0.266 | 0.688 | 2.043 | −1.527 | 0.605 | 2.043 | 0.143 | 0.778 | 2.043 |
| 0.212 | 0.668 | 2.043 | −1.527 | 0.609 | 2.043 | 0.199 | 0.787 | 2.043 |
| 0.156 | 0.647 | 2.043 | −1.526 | 0.612 | 2.043 | 0.254 | 0.797 | 2.043 |
| 0.098 | 0.625 | 2.043 | −1.523 | 0.615 | 2.043 | 0.306 | 0.806 | 2.043 |
| 0.037 | 0.603 | 2.043 | −1.518 | 0.618 | 2.043 | 0.356 | 0.815 | 2.043 |
| −0.026 | 0.581 | 2.043 | −1.512 | 0.621 | 2.043 | 0.403 | 0.823 | 2.043 |
| −0.091 | 0.560 | 2.043 | −1.504 | 0.624 | 2.043 | 0.447 | 0.832 | 2.043 |
| −0.157 | 0.539 | 2.043 | −1.493 | 0.626 | 2.043 | 0.486 | 0.839 | 2.043 |
| −0.223 | 0.519 | 2.043 | −1.479 | 0.629 | 2.043 | 0.520 | 0.846 | 2.043 |
| −0.290 | 0.500 | 2.043 | −1.461 | 0.631 | 2.043 | 0.553 | 0.852 | 2.043 |
| −0.356 | 0.483 | 2.043 | −1.441 | 0.634 | 2.043 | 0.581 | 0.857 | 2.043 |
| −0.424 | 0.468 | 2.043 | −1.417 | 0.635 | 2.043 | 0.603 | 0.862 | 2.043 |
| −0.491 | 0.454 | 2.043 | −1.388 | 0.637 | 2.043 | 0.620 | 0.865 | 2.043 |
| −0.560 | 0.443 | 2.043 | −1.355 | 0.638 | 2.043 | 0.633 | 0.867 | 2.043 |
| −0.628 | 0.434 | 2.043 | −1.317 | 0.639 | 2.043 | 0.642 | 0.864 | 2.043 |
| −0.697 | 0.427 | 2.043 | −1.276 | 0.640 | 2.043 | 0.646 | 0.860 | 2.043 |
| −0.766 | 0.423 | 2.043 | −1.229 | 0.642 | 2.043 | 0.648 | 0.857 | 2.043 |
| −0.835 | 0.422 | 2.043 | −1.179 | 0.643 | 2.043 | 0.649 | 0.856 | 2.043 |
| −0.901 | 0.423 | 2.043 | −1.126 | 0.645 | 2.043 | 0.649 | 0.855 | 2.043 |
| −0.966 | 0.427 | 2.043 | −1.071 | 0.647 | 2.043 | 0.649 | 0.854 | 2.043 |
| −1.027 | 0.433 | 2.043 | −1.013 | 0.649 | 2.043 | | | |
| −1.086 | 0.441 | 2.043 | −0.954 | 0.652 | 2.043 | | | |
| 0.562 | 0.899 | 2.724 | −1.152 | 0.542 | 2.724 | −0.913 | 0.712 | 2.724 |
| 0.562 | 0.898 | 2.724 | −1.204 | 0.552 | 2.724 | −0.852 | 0.716 | 2.724 |
| 0.563 | 0.896 | 2.724 | −1.252 | 0.563 | 2.724 | −0.789 | 0.720 | 2.724 |
| 0.563 | 0.893 | 2.724 | −1.297 | 0.575 | 2.724 | −0.726 | 0.724 | 2.724 |
| 0.562 | 0.888 | 2.724 | −1.336 | 0.586 | 2.724 | −0.663 | 0.730 | 2.724 |
| 0.556 | 0.880 | 2.724 | −1.372 | 0.598 | 2.724 | −0.600 | 0.736 | 2.724 |
| 0.544 | 0.874 | 2.724 | −1.403 | 0.610 | 2.724 | −0.537 | 0.742 | 2.724 |
| 0.527 | 0.868 | 2.724 | −1.429 | 0.620 | 2.724 | −0.474 | 0.749 | 2.724 |
| 0.507 | 0.861 | 2.724 | −1.451 | 0.630 | 2.724 | −0.411 | 0.756 | 2.724 |
| 0.480 | 0.851 | 2.724 | −1.470 | 0.639 | 2.724 | −0.348 | 0.764 | 2.724 |
| 0.449 | 0.839 | 2.724 | −1.485 | 0.647 | 2.724 | −0.285 | 0.772 | 2.724 |
| 0.416 | 0.827 | 2.724 | −1.497 | 0.655 | 2.724 | −0.222 | 0.780 | 2.724 |
| 0.379 | 0.814 | 2.724 | −1.507 | 0.661 | 2.724 | −0.160 | 0.789 | 2.724 |
| 0.338 | 0.799 | 2.724 | −1.514 | 0.667 | 2.724 | −0.097 | 0.798 | 2.724 |
| 0.293 | 0.783 | 2.724 | −1.518 | 0.672 | 2.724 | −0.037 | 0.807 | 2.724 |
| 0.245 | 0.766 | 2.724 | −1.521 | 0.676 | 2.724 | 0.022 | 0.816 | 2.724 |
| 0.195 | 0.748 | 2.724 | −1.523 | 0.680 | 2.724 | 0.078 | 0.825 | 2.724 |
| 0.144 | 0.730 | 2.724 | −1.523 | 0.684 | 2.724 | 0.132 | 0.834 | 2.724 |
| 0.090 | 0.712 | 2.724 | −1.522 | 0.687 | 2.724 | 0.184 | 0.843 | 2.724 |
| 0.034 | 0.693 | 2.724 | −1.519 | 0.690 | 2.724 | 0.234 | 0.852 | 2.724 |
| −0.025 | 0.673 | 2.724 | −1.514 | 0.692 | 2.724 | 0.282 | 0.861 | 2.724 |
| −0.085 | 0.654 | 2.724 | −1.508 | 0.694 | 2.724 | 0.328 | 0.870 | 2.724 |
| −0.148 | 0.635 | 2.724 | −1.500 | 0.696 | 2.724 | 0.369 | 0.878 | 2.724 |
| −0.211 | 0.617 | 2.724 | −1.489 | 0.698 | 2.724 | 0.406 | 0.885 | 2.724 |
| −0.275 | 0.599 | 2.724 | −1.475 | 0.700 | 2.724 | 0.439 | 0.891 | 2.724 |
| −0.338 | 0.583 | 2.724 | −1.459 | 0.702 | 2.724 | 0.470 | 0.898 | 2.724 |
| −0.402 | 0.568 | 2.724 | −1.439 | 0.703 | 2.724 | 0.497 | 0.903 | 2.724 |
| −0.467 | 0.555 | 2.724 | −1.416 | 0.703 | 2.724 | 0.518 | 0.907 | 2.724 |
| −0.532 | 0.543 | 2.724 | −1.388 | 0.704 | 2.724 | 0.535 | 0.911 | 2.724 |
| −0.596 | 0.534 | 2.724 | −1.357 | 0.704 | 2.724 | 0.547 | 0.913 | 2.724 |
| −0.662 | 0.526 | 2.724 | −1.321 | 0.704 | 2.724 | 0.556 | 0.909 | 2.724 |
| −0.727 | 0.520 | 2.724 | −1.281 | 0.704 | 2.724 | 0.559 | 0.905 | 2.724 |
| −0.793 | 0.516 | 2.724 | −1.236 | 0.704 | 2.724 | 0.561 | 0.902 | 2.724 |
| −0.858 | 0.516 | 2.724 | −1.188 | 0.704 | 2.724 | 0.562 | 0.901 | 2.724 |
| −0.922 | 0.517 | 2.724 | −1.137 | 0.705 | 2.724 | 0.562 | 0.900 | 2.724 |
| −0.983 | 0.521 | 2.724 | −1.084 | 0.706 | 2.724 | 0.562 | 0.899 | 2.724 |
| −1.042 | 0.526 | 2.724 | −1.029 | 0.707 | 2.724 | | | |
| −1.098 | 0.533 | 2.724 | −0.972 | 0.710 | 2.724 | | | |
| 0.568 | 0.869 | 3.064 | −1.110 | 0.536 | 3.064 | −0.876 | 0.686 | 3.064 |
| 0.568 | 0.868 | 3.064 | −1.160 | 0.545 | 3.064 | −0.816 | 0.689 | 3.064 |
| 0.569 | 0.866 | 3.064 | −1.207 | 0.556 | 3.064 | −0.754 | 0.692 | 3.064 |
| 0.569 | 0.863 | 3.064 | −1.251 | 0.568 | 3.064 | −0.692 | 0.696 | 3.064 |
| 0.568 | 0.857 | 3.064 | −1.290 | 0.579 | 3.064 | −0.630 | 0.701 | 3.064 |
| 0.562 | 0.850 | 3.064 | −1.324 | 0.590 | 3.064 | −0.569 | 0.707 | 3.064 |

TABLE 14S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.550 | 0.844 | 3.064 | −1.354 | 0.601 | 3.064 | −0.507 | 0.713 | 3.064 |
| 0.534 | 0.838 | 3.064 | −1.381 | 0.611 | 3.064 | −0.445 | 0.719 | 3.064 |
| 0.514 | 0.831 | 3.064 | −1.402 | 0.620 | 3.064 | −0.384 | 0.726 | 3.064 |
| 0.488 | 0.821 | 3.064 | −1.421 | 0.629 | 3.064 | −0.322 | 0.734 | 3.064 |
| 0.458 | 0.810 | 3.064 | −1.436 | 0.636 | 3.064 | −0.261 | 0.741 | 3.064 |
| 0.426 | 0.799 | 3.064 | −1.448 | 0.643 | 3.064 | −0.199 | 0.750 | 3.064 |
| 0.389 | 0.786 | 3.064 | −1.457 | 0.650 | 3.064 | −0.138 | 0.758 | 3.064 |
| 0.349 | 0.772 | 3.064 | −1.464 | 0.655 | 3.064 | −0.077 | 0.767 | 3.064 |
| 0.304 | 0.756 | 3.064 | −1.469 | 0.659 | 3.064 | −0.017 | 0.777 | 3.064 |
| 0.258 | 0.740 | 3.064 | −1.472 | 0.664 | 3.064 | 0.040 | 0.786 | 3.064 |
| 0.209 | 0.724 | 3.064 | −1.474 | 0.668 | 3.064 | 0.095 | 0.795 | 3.064 |
| 0.158 | 0.707 | 3.064 | −1.473 | 0.671 | 3.064 | 0.148 | 0.804 | 3.064 |
| 0.106 | 0.689 | 3.064 | −1.472 | 0.674 | 3.064 | 0.199 | 0.812 | 3.064 |
| 0.051 | 0.672 | 3.064 | −1.469 | 0.676 | 3.064 | 0.247 | 0.821 | 3.064 |
| −0.007 | 0.654 | 3.064 | −1.464 | 0.679 | 3.064 | 0.294 | 0.830 | 3.064 |
| −0.066 | 0.636 | 3.064 | −1.459 | 0.681 | 3.064 | 0.339 | 0.839 | 3.064 |
| −0.128 | 0.618 | 3.064 | −1.450 | 0.682 | 3.064 | 0.379 | 0.847 | 3.064 |
| −0.190 | 0.601 | 3.064 | −1.440 | 0.684 | 3.064 | 0.416 | 0.854 | 3.064 |
| −0.252 | 0.585 | 3.064 | −1.426 | 0.685 | 3.064 | 0.448 | 0.861 | 3.064 |
| −0.314 | 0.570 | 3.064 | −1.410 | 0.686 | 3.064 | 0.478 | 0.867 | 3.064 |
| −0.377 | 0.556 | 3.064 | −1.391 | 0.686 | 3.064 | 0.505 | 0.873 | 3.064 |
| −0.440 | 0.544 | 3.064 | −1.368 | 0.686 | 3.064 | 0.525 | 0.877 | 3.064 |
| −0.503 | 0.533 | 3.064 | −1.341 | 0.686 | 3.064 | 0.541 | 0.881 | 3.064 |
| −0.567 | 0.524 | 3.064 | −1.310 | 0.685 | 3.064 | 0.553 | 0.882 | 3.064 |
| −0.631 | 0.517 | 3.064 | −1.275 | 0.684 | 3.064 | 0.562 | 0.879 | 3.064 |
| −0.695 | 0.512 | 3.064 | −1.236 | 0.683 | 3.064 | 0.565 | 0.875 | 3.064 |
| −0.759 | 0.510 | 3.064 | −1.192 | 0.683 | 3.064 | 0.567 | 0.872 | 3.064 |
| −0.823 | 0.509 | 3.064 | −1.145 | 0.682 | 3.064 | 0.568 | 0.870 | 3.064 |
| −0.885 | 0.511 | 3.064 | −1.095 | 0.682 | 3.064 | 0.568 | 0.870 | 3.064 |
| −0.945 | 0.515 | 3.064 | −1.043 | 0.682 | 3.064 | 0.568 | 0.869 | 3.064 |
| −1.002 | 0.520 | 3.064 | −0.990 | 0.682 | 3.064 | | | |
| −1.057 | 0.527 | 3.064 | −0.934 | 0.684 | 3.064 | | | |
| 0.604 | 0.807 | 3.405 | −1.040 | 0.497 | 3.405 | −0.811 | 0.631 | 3.405 |
| 0.604 | 0.806 | 3.405 | −1.089 | 0.507 | 3.405 | −0.752 | 0.633 | 3.405 |
| 0.604 | 0.805 | 3.405 | −1.136 | 0.517 | 3.405 | −0.691 | 0.636 | 3.405 |
| 0.604 | 0.801 | 3.405 | −1.178 | 0.528 | 3.405 | −0.631 | 0.639 | 3.405 |
| 0.603 | 0.796 | 3.405 | −1.216 | 0.540 | 3.405 | −0.570 | 0.644 | 3.405 |
| 0.598 | 0.788 | 3.405 | −1.250 | 0.550 | 3.405 | −0.509 | 0.649 | 3.405 |
| 0.587 | 0.783 | 3.405 | −1.279 | 0.561 | 3.405 | −0.449 | 0.654 | 3.405 |
| 0.571 | 0.777 | 3.405 | −1.305 | 0.571 | 3.405 | −0.389 | 0.660 | 3.405 |
| 0.552 | 0.770 | 3.405 | −1.326 | 0.580 | 3.405 | −0.328 | 0.667 | 3.405 |
| 0.526 | 0.760 | 3.405 | −1.344 | 0.588 | 3.405 | −0.268 | 0.674 | 3.405 |
| 0.497 | 0.749 | 3.405 | −1.359 | 0.595 | 3.405 | −0.208 | 0.681 | 3.405 |
| 0.465 | 0.738 | 3.405 | −1.371 | 0.602 | 3.405 | −0.148 | 0.689 | 3.405 |
| 0.430 | 0.725 | 3.405 | −1.380 | 0.608 | 3.405 | −0.087 | 0.697 | 3.405 |
| 0.390 | 0.712 | 3.405 | −1.387 | 0.613 | 3.405 | −0.027 | 0.706 | 3.405 |
| 0.346 | 0.697 | 3.405 | −1.392 | 0.617 | 3.405 | 0.031 | 0.715 | 3.405 |
| 0.301 | 0.681 | 3.405 | −1.395 | 0.621 | 3.405 | 0.087 | 0.724 | 3.405 |
| 0.253 | 0.666 | 3.405 | −1.396 | 0.625 | 3.405 | 0.141 | 0.732 | 3.405 |
| 0.203 | 0.649 | 3.405 | −1.396 | 0.628 | 3.405 | 0.193 | 0.741 | 3.405 |
| 0.151 | 0.633 | 3.405 | −1.395 | 0.631 | 3.405 | 0.242 | 0.750 | 3.405 |
| 0.097 | 0.616 | 3.405 | −1.392 | 0.634 | 3.405 | 0.290 | 0.759 | 3.405 |
| 0.041 | 0.599 | 3.405 | −1.387 | 0.636 | 3.405 | 0.336 | 0.768 | 3.405 |
| −0.017 | 0.583 | 3.405 | −1.381 | 0.638 | 3.405 | 0.380 | 0.776 | 3.405 |
| −0.078 | 0.566 | 3.405 | −1.373 | 0.639 | 3.405 | 0.419 | 0.785 | 3.405 |
| −0.139 | 0.550 | 3.405 | −1.363 | 0.640 | 3.405 | 0.455 | 0.792 | 3.405 |
| −0.200 | 0.535 | 3.405 | −1.350 | 0.641 | 3.405 | 0.486 | 0.799 | 3.405 |
| −0.261 | 0.521 | 3.405 | −1.334 | 0.641 | 3.405 | 0.516 | 0.806 | 3.405 |
| −0.322 | 0.509 | 3.405 | −1.315 | 0.641 | 3.405 | 0.542 | 0.811 | 3.405 |
| −0.384 | 0.498 | 3.405 | −1.292 | 0.640 | 3.405 | 0.562 | 0.816 | 3.405 |
| −0.446 | 0.488 | 3.405 | −1.266 | 0.639 | 3.405 | 0.577 | 0.819 | 3.405 |
| −0.509 | 0.480 | 3.405 | −1.236 | 0.638 | 3.405 | 0.589 | 0.821 | 3.405 |
| −0.571 | 0.474 | 3.405 | −1.201 | 0.636 | 3.405 | 0.598 | 0.817 | 3.405 |
| −0.634 | 0.470 | 3.405 | −1.163 | 0.634 | 3.405 | 0.601 | 0.813 | 3.405 |
| −0.697 | 0.468 | 3.405 | −1.120 | 0.633 | 3.405 | 0.603 | 0.810 | 3.405 |
| −0.759 | 0.468 | 3.405 | −1.074 | 0.631 | 3.405 | 0.603 | 0.809 | 3.405 |
| −0.820 | 0.471 | 3.405 | −1.025 | 0.630 | 3.405 | 0.603 | 0.808 | 3.405 |
| −0.878 | 0.475 | 3.405 | −0.975 | 0.629 | 3.405 | 0.604 | 0.808 | 3.405 |
| −0.934 | 0.481 | 3.405 | −0.922 | 0.629 | 3.405 | | | |
| −0.988 | 0.488 | 3.405 | −0.867 | 0.630 | 3.405 | | | |
| 0.764 | 0.589 | 4.085 | −0.823 | 0.328 | 4.085 | −0.600 | 0.438 | 4.085 |
| 0.764 | 0.588 | 4.085 | −0.870 | 0.339 | 4.085 | −0.544 | 0.439 | 4.085 |
| 0.764 | 0.587 | 4.085 | −0.915 | 0.350 | 4.085 | −0.485 | 0.440 | 4.085 |
| 0.764 | 0.584 | 4.085 | −0.955 | 0.362 | 4.085 | −0.427 | 0.442 | 4.085 |
| 0.763 | 0.579 | 4.085 | −0.992 | 0.373 | 4.085 | −0.368 | 0.444 | 4.085 |
| 0.759 | 0.571 | 4.085 | −1.024 | 0.385 | 4.085 | −0.310 | 0.447 | 4.085 |
| 0.749 | 0.565 | 4.085 | −1.052 | 0.395 | 4.085 | −0.251 | 0.451 | 4.085 |

TABLE 14S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.734 | 0.559 | 4.085 | −1.077 | 0.405 | 4.085 | −0.193 | 0.456 | 4.085 |
| 0.715 | 0.552 | 4.085 | −1.097 | 0.414 | 4.085 | −0.135 | 0.461 | 4.085 |
| 0.690 | 0.543 | 4.085 | −1.114 | 0.422 | 4.085 | −0.077 | 0.466 | 4.085 |
| 0.662 | 0.532 | 4.085 | −1.129 | 0.429 | 4.085 | −0.018 | 0.472 | 4.085 |
| 0.631 | 0.521 | 4.085 | −1.140 | 0.435 | 4.085 | 0.040 | 0.479 | 4.085 |
| 0.597 | 0.509 | 4.085 | −1.149 | 0.441 | 4.085 | 0.098 | 0.485 | 4.085 |
| 0.559 | 0.496 | 4.085 | −1.155 | 0.446 | 4.085 | 0.156 | 0.493 | 4.085 |
| 0.517 | 0.482 | 4.085 | −1.160 | 0.450 | 4.085 | 0.212 | 0.501 | 4.085 |
| 0.473 | 0.468 | 4.085 | −1.163 | 0.455 | 4.085 | 0.266 | 0.508 | 4.085 |
| 0.427 | 0.453 | 4.085 | −1.164 | 0.458 | 4.085 | 0.318 | 0.517 | 4.085 |
| 0.378 | 0.438 | 4.085 | −1.164 | 0.461 | 4.085 | 0.368 | 0.525 | 4.085 |
| 0.328 | 0.423 | 4.085 | −1.163 | 0.464 | 4.085 | 0.416 | 0.533 | 4.085 |
| 0.276 | 0.408 | 4.085 | −1.160 | 0.466 | 4.085 | 0.462 | 0.542 | 4.085 |
| 0.221 | 0.393 | 4.085 | −1.155 | 0.468 | 4.085 | 0.506 | 0.550 | 4.085 |
| 0.165 | 0.378 | 4.085 | −1.149 | 0.470 | 4.085 | 0.548 | 0.559 | 4.085 |
| 0.106 | 0.364 | 4.085 | −1.142 | 0.471 | 4.085 | 0.586 | 0.567 | 4.085 |
| 0.047 | 0.350 | 4.085 | −1.131 | 0.471 | 4.085 | 0.621 | 0.574 | 4.085 |
| −0.012 | 0.338 | 4.085 | −1.119 | 0.471 | 4.085 | 0.651 | 0.581 | 4.085 |
| −0.072 | 0.327 | 4.085 | −1.103 | 0.470 | 4.085 | 0.680 | 0.588 | 4.085 |
| −0.131 | 0.317 | 4.085 | −1.085 | 0.469 | 4.085 | 0.704 | 0.594 | 4.085 |
| −0.191 | 0.308 | 4.085 | −1.064 | 0.467 | 4.085 | 0.723 | 0.598 | 4.085 |
| −0.251 | 0.301 | 4.085 | −1.038 | 0.464 | 4.085 | 0.738 | 0.602 | 4.085 |
| −0.312 | 0.296 | 4.085 | −1.009 | 0.461 | 4.085 | 0.750 | 0.603 | 4.085 |
| −0.372 | 0.292 | 4.085 | −0.976 | 0.458 | 4.085 | 0.758 | 0.599 | 4.085 |
| −0.433 | 0.290 | 4.085 | −0.939 | 0.455 | 4.085 | 0.761 | 0.595 | 4.085 |
| −0.493 | 0.291 | 4.085 | −0.898 | 0.451 | 4.085 | 0.762 | 0.592 | 4.085 |
| −0.554 | 0.293 | 4.085 | −0.854 | 0.448 | 4.085 | 0.763 | 0.591 | 4.085 |
| −0.612 | 0.297 | 4.085 | −0.807 | 0.445 | 4.085 | 0.763 | 0.590 | 4.085 |
| −0.668 | 0.302 | 4.085 | −0.758 | 0.442 | 4.085 | 0.763 | 0.590 | 4.085 |
| −0.722 | 0.309 | 4.085 | −0.708 | 0.440 | 4.085 | | | |
| −0.774 | 0.318 | 4.085 | −0.655 | 0.439 | 4.085 | | | |
| 0.877 | 0.445 | 4.426 | −0.690 | 0.217 | 4.426 | −0.470 | 0.314 | 4.426 |
| 0.877 | 0.444 | 4.426 | −0.737 | 0.228 | 4.426 | −0.414 | 0.313 | 4.426 |
| 0.877 | 0.442 | 4.426 | −0.781 | 0.240 | 4.426 | −0.356 | 0.313 | 4.426 |
| 0.878 | 0.439 | 4.426 | −0.820 | 0.253 | 4.426 | −0.298 | 0.313 | 4.426 |
| 0.877 | 0.434 | 4.426 | −0.856 | 0.265 | 4.426 | −0.241 | 0.315 | 4.426 |
| 0.873 | 0.427 | 4.426 | −0.888 | 0.276 | 4.426 | −0.183 | 0.317 | 4.426 |
| 0.863 | 0.420 | 4.426 | −0.916 | 0.287 | 4.426 | −0.125 | 0.320 | 4.426 |
| 0.848 | 0.415 | 4.426 | −0.940 | 0.297 | 4.426 | −0.068 | 0.323 | 4.426 |
| 0.829 | 0.408 | 4.426 | −0.960 | 0.305 | 4.426 | −0.010 | 0.327 | 4.426 |
| 0.805 | 0.399 | 4.426 | −0.977 | 0.313 | 4.426 | 0.047 | 0.331 | 4.426 |
| 0.777 | 0.389 | 4.426 | −0.991 | 0.321 | 4.426 | 0.105 | 0.336 | 4.426 |
| 0.747 | 0.379 | 4.426 | −1.002 | 0.327 | 4.426 | 0.162 | 0.342 | 4.426 |
| 0.713 | 0.367 | 4.426 | −1.010 | 0.333 | 4.426 | 0.220 | 0.347 | 4.426 |
| 0.675 | 0.355 | 4.426 | −1.017 | 0.338 | 4.426 | 0.277 | 0.354 | 4.426 |
| 0.633 | 0.341 | 4.426 | −1.021 | 0.343 | 4.426 | 0.332 | 0.361 | 4.426 |
| 0.590 | 0.328 | 4.426 | −1.024 | 0.347 | 4.426 | 0.386 | 0.368 | 4.426 |
| 0.544 | 0.314 | 4.426 | −1.025 | 0.350 | 4.426 | 0.437 | 0.375 | 4.426 |
| 0.496 | 0.300 | 4.426 | −1.025 | 0.353 | 4.426 | 0.487 | 0.383 | 4.426 |
| 0.447 | 0.286 | 4.426 | −1.023 | 0.356 | 4.426 | 0.534 | 0.391 | 4.426 |
| 0.395 | 0.272 | 4.426 | −1.020 | 0.358 | 4.426 | 0.580 | 0.399 | 4.426 |
| 0.341 | 0.259 | 4.426 | −1.016 | 0.360 | 4.426 | 0.623 | 0.407 | 4.426 |
| 0.285 | 0.245 | 4.426 | −1.010 | 0.361 | 4.426 | 0.665 | 0.415 | 4.426 |
| 0.226 | 0.233 | 4.426 | −1.002 | 0.362 | 4.426 | 0.702 | 0.423 | 4.426 |
| 0.168 | 0.221 | 4.426 | −0.992 | 0.362 | 4.426 | 0.736 | 0.431 | 4.426 |
| 0.109 | 0.210 | 4.426 | −0.980 | 0.361 | 4.426 | 0.766 | 0.437 | 4.426 |
| 0.050 | 0.201 | 4.426 | −0.965 | 0.360 | 4.426 | 0.794 | 0.444 | 4.426 |
| −0.009 | 0.192 | 4.426 | −0.947 | 0.358 | 4.426 | 0.819 | 0.450 | 4.426 |
| −0.068 | 0.185 | 4.426 | −0.926 | 0.355 | 4.426 | 0.837 | 0.454 | 4.426 |
| −0.127 | 0.180 | 4.426 | −0.901 | 0.351 | 4.426 | 0.852 | 0.458 | 4.426 |
| −0.187 | 0.176 | 4.426 | −0.872 | 0.348 | 4.426 | 0.864 | 0.458 | 4.426 |
| −0.246 | 0.174 | 4.426 | −0.840 | 0.343 | 4.426 | 0.871 | 0.454 | 4.426 |
| −0.306 | 0.173 | 4.426 | −0.803 | 0.339 | 4.426 | 0.874 | 0.450 | 4.426 |
| −0.366 | 0.175 | 4.426 | −0.763 | 0.334 | 4.426 | 0.876 | 0.448 | 4.426 |
| −0.425 | 0.178 | 4.426 | −0.719 | 0.329 | 4.426 | 0.876 | 0.446 | 4.426 |
| −0.483 | 0.183 | 4.426 | −0.673 | 0.325 | 4.426 | 0.877 | 0.445 | 4.426 |
| −0.538 | 0.189 | 4.426 | −0.625 | 0.321 | 4.426 | 0.877 | 0.445 | 4.426 |
| −0.591 | 0.197 | 4.426 | −0.575 | 0.318 | 4.426 | | | |
| −0.642 | 0.206 | 4.426 | −0.523 | 0.315 | 4.426 | | | |
| 1.061 | 0.213 | 4.937 | −0.563 | 0.103 | 4.937 | −0.333 | 0.150 | 4.937 |
| 1.062 | 0.212 | 4.937 | −0.609 | 0.120 | 4.937 | −0.275 | 0.142 | 4.937 |
| 1.062 | 0.210 | 4.937 | −0.654 | 0.137 | 4.937 | −0.216 | 0.135 | 4.937 |
| 1.062 | 0.207 | 4.937 | −0.693 | 0.154 | 4.937 | −0.157 | 0.129 | 4.937 |
| 1.061 | 0.202 | 4.937 | −0.729 | 0.170 | 4.937 | −0.097 | 0.124 | 4.937 |
| 1.057 | 0.193 | 4.937 | −0.761 | 0.184 | 4.937 | −0.038 | 0.120 | 4.937 |
| 1.046 | 0.187 | 4.937 | −0.788 | 0.198 | 4.937 | 0.022 | 0.118 | 4.937 |
| 1.031 | 0.181 | 4.937 | −0.812 | 0.210 | 4.937 | 0.082 | 0.116 | 4.937 |

TABLE 14S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.012 | 0.174 | 4.937 | −0.832 | 0.221 | 4.937 | 0.142 | 0.115 | 4.937 |
| 0.987 | 0.165 | 4.937 | −0.849 | 0.231 | 4.937 | 0.201 | 0.115 | 4.937 |
| 0.958 | 0.154 | 4.937 | −0.863 | 0.239 | 4.937 | 0.261 | 0.116 | 4.937 |
| 0.926 | 0.144 | 4.937 | −0.874 | 0.247 | 4.937 | 0.321 | 0.118 | 4.937 |
| 0.891 | 0.132 | 4.937 | −0.882 | 0.254 | 4.937 | 0.380 | 0.121 | 4.937 |
| 0.852 | 0.120 | 4.937 | −0.888 | 0.260 | 4.937 | 0.440 | 0.124 | 4.937 |
| 0.808 | 0.107 | 4.937 | −0.892 | 0.265 | 4.937 | 0.497 | 0.129 | 4.937 |
| 0.763 | 0.094 | 4.937 | −0.894 | 0.269 | 4.937 | 0.553 | 0.134 | 4.937 |
| 0.715 | 0.082 | 4.937 | −0.896 | 0.273 | 4.937 | 0.606 | 0.140 | 4.937 |
| 0.665 | 0.069 | 4.937 | −0.895 | 0.276 | 4.937 | 0.658 | 0.147 | 4.937 |
| 0.613 | 0.058 | 4.937 | −0.893 | 0.278 | 4.937 | 0.707 | 0.154 | 4.937 |
| 0.558 | 0.046 | 4.937 | −0.890 | 0.280 | 4.937 | 0.754 | 0.162 | 4.937 |
| 0.501 | 0.036 | 4.937 | −0.885 | 0.281 | 4.937 | 0.799 | 0.170 | 4.937 |
| 0.442 | 0.026 | 4.937 | −0.879 | 0.281 | 4.937 | 0.842 | 0.178 | 4.937 |
| 0.381 | 0.018 | 4.937 | −0.871 | 0.281 | 4.937 | 0.881 | 0.187 | 4.937 |
| 0.320 | 0.011 | 4.937 | −0.861 | 0.279 | 4.937 | 0.916 | 0.195 | 4.937 |
| 0.259 | 0.005 | 4.937 | −0.848 | 0.277 | 4.937 | 0.947 | 0.202 | 4.937 |
| 0.197 | 0.001 | 4.937 | −0.833 | 0.273 | 4.937 | 0.976 | 0.210 | 4.937 |
| 0.135 | −0.001 | 4.937 | −0.815 | 0.267 | 4.937 | 1.001 | 0.216 | 4.937 |
| 0.073 | −0.002 | 4.937 | −0.794 | 0.261 | 4.937 | 1.021 | 0.221 | 4.937 |
| 0.012 | −0.001 | 4.937 | −0.769 | 0.253 | 4.937 | 1.036 | 0.226 | 4.937 |
| −0.050 | 0.002 | 4.937 | −0.740 | 0.244 | 4.937 | 1.048 | 0.226 | 4.937 |
| −0.111 | 0.007 | 4.937 | −0.708 | 0.235 | 4.937 | 1.056 | 0.222 | 4.937 |
| −0.173 | 0.013 | 4.937 | −0.671 | 0.224 | 4.937 | 1.059 | 0.219 | 4.937 |
| −0.234 | 0.021 | 4.937 | −0.631 | 0.213 | 4.937 | 1.060 | 0.216 | 4.937 |
| −0.295 | 0.032 | 4.937 | −0.586 | 0.201 | 4.937 | 1.061 | 0.214 | 4.937 |
| −0.354 | 0.044 | 4.937 | −0.540 | 0.190 | 4.937 | 1.061 | 0.214 | 4.937 |
| −0.410 | 0.057 | 4.937 | −0.491 | 0.179 | 4.937 | 1.061 | 0.213 | 4.937 |
| −0.463 | 0.071 | 4.937 | −0.441 | 0.169 | 4.937 | | | |
| −0.514 | 0.087 | 4.937 | −0.388 | 0.159 | 4.937 | | | |
| 1.262 | −0.038 | 5.447 | −0.516 | 0.067 | 5.447 | −0.270 | 0.050 | 5.447 |
| 1.263 | −0.039 | 5.447 | −0.564 | 0.091 | 5.447 | −0.209 | 0.030 | 5.447 |
| 1.263 | −0.041 | 5.447 | −0.610 | 0.116 | 5.447 | −0.145 | 0.011 | 5.447 |
| 1.263 | −0.045 | 5.447 | −0.652 | 0.140 | 5.447 | −0.081 | −0.006 | 5.447 |
| 1.262 | −0.050 | 5.447 | −0.689 | 0.162 | 5.447 | −0.017 | −0.022 | 5.447 |
| 1.256 | −0.058 | 5.447 | −0.722 | 0.182 | 5.447 | 0.047 | −0.036 | 5.447 |
| 1.244 | −0.064 | 5.447 | −0.750 | 0.200 | 5.447 | 0.112 | −0.049 | 5.447 |
| 1.226 | −0.069 | 5.447 | −0.775 | 0.216 | 5.447 | 0.176 | −0.061 | 5.447 |
| 1.204 | −0.076 | 5.447 | −0.796 | 0.230 | 5.447 | 0.241 | −0.070 | 5.447 |
| 1.176 | −0.084 | 5.447 | −0.813 | 0.243 | 5.447 | 0.306 | −0.079 | 5.447 |
| 1.143 | −0.093 | 5.447 | −0.827 | 0.254 | 5.447 | 0.371 | −0.086 | 5.447 |
| 1.108 | −0.102 | 5.447 | −0.838 | 0.264 | 5.447 | 0.437 | −0.091 | 5.447 |
| 1.068 | −0.112 | 5.447 | −0.846 | 0.273 | 5.447 | 0.502 | −0.094 | 5.447 |
| 1.024 | −0.122 | 5.447 | −0.852 | 0.280 | 5.447 | 0.568 | −0.096 | 5.447 |
| 0.975 | −0.133 | 5.447 | −0.855 | 0.285 | 5.447 | 0.632 | −0.096 | 5.447 |
| 0.924 | −0.143 | 5.447 | −0.858 | 0.291 | 5.447 | 0.694 | −0.095 | 5.447 |
| 0.871 | −0.153 | 5.447 | −0.859 | 0.295 | 5.447 | 0.754 | −0.093 | 5.447 |
| 0.814 | −0.161 | 5.447 | −0.858 | 0.298 | 5.447 | 0.811 | −0.089 | 5.447 |
| 0.756 | −0.169 | 5.447 | −0.855 | 0.301 | 5.447 | 0.866 | −0.085 | 5.447 |
| 0.695 | −0.175 | 5.447 | −0.851 | 0.302 | 5.447 | 0.918 | −0.079 | 5.447 |
| 0.632 | −0.180 | 5.447 | −0.845 | 0.302 | 5.447 | 0.969 | −0.073 | 5.447 |
| 0.566 | −0.183 | 5.447 | −0.839 | 0.301 | 5.447 | 1.017 | −0.066 | 5.447 |
| 0.498 | −0.185 | 5.447 | −0.830 | 0.299 | 5.447 | 1.061 | −0.059 | 5.447 |
| 0.430 | −0.184 | 5.447 | −0.819 | 0.295 | 5.447 | 1.100 | −0.052 | 5.447 |
| 0.362 | −0.180 | 5.447 | −0.806 | 0.290 | 5.447 | 1.134 | −0.046 | 5.447 |
| 0.294 | −0.175 | 5.447 | −0.790 | 0.283 | 5.447 | 1.167 | −0.039 | 5.447 |
| 0.227 | −0.167 | 5.447 | −0.771 | 0.273 | 5.447 | 1.195 | −0.033 | 5.447 |
| 0.159 | −0.157 | 5.447 | −0.750 | 0.262 | 5.447 | 1.217 | −0.029 | 5.447 |
| 0.092 | −0.145 | 5.447 | −0.725 | 0.248 | 5.447 | 1.234 | −0.025 | 5.447 |
| 0.026 | −0.131 | 5.447 | −0.696 | 0.232 | 5.447 | 1.247 | −0.024 | 5.447 |
| −0.040 | −0.115 | 5.447 | −0.662 | 0.215 | 5.447 | 1.256 | −0.028 | 5.447 |
| −0.106 | −0.097 | 5.447 | −0.625 | 0.197 | 5.447 | 1.260 | −0.032 | 5.447 |
| −0.171 | −0.076 | 5.447 | −0.583 | 0.176 | 5.447 | 1.261 | −0.035 | 5.447 |
| −0.235 | −0.054 | 5.447 | −0.536 | 0.155 | 5.447 | 1.262 | −0.037 | 5.447 |
| −0.297 | −0.031 | 5.447 | −0.488 | 0.134 | 5.447 | 1.262 | −0.037 | 5.447 |
| −0.356 | −0.007 | 5.447 | −0.437 | 0.113 | 5.447 | 1.262 | −0.038 | 5.447 |
| −0.412 | 0.017 | 5.447 | −0.384 | 0.091 | 5.447 | | | |
| −0.465 | 0.042 | 5.447 | −0.328 | 0.071 | 5.447 | | | |

The coordinate values given in TABLE 15S below provide the nominal profile envelope for an exemplary fifteenth stage stator.

TABLE 15S

| X-LOC | Y-LOC | Z-LOC | X-LOC | Y-LOC | Z-LOC | X-LOC | Y-LOC | Z-LOC |
|---|---|---|---|---|---|---|---|---|
| 1.269 | −0.752 | 0.000 | −1.069 | 0.582 | 0.000 | −0.694 | 0.405 | 0.000 |
| 1.268 | −0.754 | 0.000 | −1.103 | 0.657 | 0.000 | −0.629 | 0.336 | 0.000 |
| 1.267 | −0.756 | 0.000 | −1.132 | 0.731 | 0.000 | −0.559 | 0.267 | 0.000 |
| 1.263 | −0.761 | 0.000 | −1.156 | 0.799 | 0.000 | −0.487 | 0.202 | 0.000 |
| 1.256 | −0.765 | 0.000 | −1.176 | 0.861 | 0.000 | −0.411 | 0.139 | 0.000 |
| 1.241 | −0.765 | 0.000 | −1.192 | 0.918 | 0.000 | −0.333 | 0.079 | 0.000 |
| 1.220 | −0.760 | 0.000 | −1.204 | 0.968 | 0.000 | −0.254 | 0.022 | 0.000 |
| 1.194 | −0.754 | 0.000 | −1.214 | 1.012 | 0.000 | −0.173 | −0.032 | 0.000 |
| 1.160 | −0.745 | 0.000 | −1.222 | 1.049 | 0.000 | −0.091 | −0.085 | 0.000 |
| 1.116 | −0.734 | 0.000 | −1.227 | 1.081 | 0.000 | −0.008 | −0.135 | 0.000 |
| 1.066 | −0.721 | 0.000 | −1.231 | 1.108 | 0.000 | 0.076 | −0.183 | 0.000 |
| 1.013 | −0.707 | 0.000 | −1.233 | 1.131 | 0.000 | 0.161 | −0.230 | 0.000 |
| 0.952 | −0.692 | 0.000 | −1.234 | 1.149 | 0.000 | 0.247 | −0.276 | 0.000 |
| 0.886 | −0.673 | 0.000 | −1.233 | 1.163 | 0.000 | 0.334 | −0.320 | 0.000 |
| 0.812 | −0.653 | 0.000 | −1.232 | 1.173 | 0.000 | 0.418 | −0.362 | 0.000 |
| 0.736 | −0.632 | 0.000 | −1.229 | 1.181 | 0.000 | 0.500 | −0.401 | 0.000 |
| 0.656 | −0.609 | 0.000 | −1.225 | 1.187 | 0.000 | 0.579 | −0.438 | 0.000 |
| 0.573 | −0.585 | 0.000 | −1.220 | 1.190 | 0.000 | 0.656 | −0.474 | 0.000 |
| 0.487 | −0.559 | 0.000 | −1.216 | 1.190 | 0.000 | 0.730 | −0.507 | 0.000 |
| 0.397 | −0.531 | 0.000 | −1.209 | 1.188 | 0.000 | 0.801 | −0.539 | 0.000 |
| 0.305 | −0.502 | 0.000 | −1.203 | 1.184 | 0.000 | 0.870 | −0.569 | 0.000 |
| 0.210 | −0.469 | 0.000 | −1.196 | 1.177 | 0.000 | 0.936 | −0.597 | 0.000 |
| 0.113 | −0.434 | 0.000 | −1.188 | 1.166 | 0.000 | 0.996 | −0.622 | 0.000 |
| 0.016 | −0.396 | 0.000 | −1.178 | 1.152 | 0.000 | 1.050 | −0.644 | 0.000 |
| −0.079 | −0.355 | 0.000 | −1.168 | 1.133 | 0.000 | 1.098 | −0.664 | 0.000 |
| −0.173 | −0.311 | 0.000 | −1.155 | 1.111 | 0.000 | 1.144 | −0.682 | 0.000 |
| −0.265 | −0.264 | 0.000 | −1.141 | 1.083 | 0.000 | 1.183 | −0.697 | 0.000 |
| −0.354 | −0.212 | 0.000 | −1.124 | 1.051 | 0.000 | 1.213 | −0.709 | 0.000 |
| −0.441 | −0.157 | 0.000 | −1.105 | 1.013 | 0.000 | 1.238 | −0.718 | 0.000 |
| −0.525 | −0.098 | 0.000 | −1.082 | 0.970 | 0.000 | 1.256 | −0.725 | 0.000 |
| −0.606 | −0.033 | 0.000 | −1.055 | 0.921 | 0.000 | 1.267 | −0.735 | 0.000 |
| −0.683 | 0.036 | 0.000 | −1.025 | 0.867 | 0.000 | 1.270 | −0.742 | 0.000 |
| −0.756 | 0.111 | 0.000 | −0.990 | 0.807 | 0.000 | 1.270 | −0.747 | 0.000 |
| −0.823 | 0.188 | 0.000 | −0.950 | 0.743 | 0.000 | 1.269 | −0.750 | 0.000 |
| −0.884 | 0.267 | 0.000 | −0.906 | 0.678 | 0.000 | 1.269 | −0.751 | 0.000 |
| −0.938 | 0.346 | 0.000 | −0.859 | 0.610 | 0.000 | 1.269 | −0.752 | 0.000 |
| −0.987 | 0.426 | 0.000 | −0.808 | 0.542 | 0.000 | | | |
| −1.031 | 0.505 | 0.000 | −0.753 | 0.474 | 0.000 | | | |
| 1.268 | −0.576 | 0.431 | −0.982 | 0.386 | 0.431 | −0.628 | 0.297 | 0.431 |
| 1.268 | −0.577 | 0.431 | −1.030 | 0.443 | 0.431 | −0.558 | 0.246 | 0.431 |
| 1.267 | −0.579 | 0.431 | −1.073 | 0.500 | 0.431 | −0.485 | 0.196 | 0.431 |
| 1.264 | −0.583 | 0.431 | −1.112 | 0.552 | 0.431 | −0.411 | 0.147 | 0.431 |
| 1.257 | −0.587 | 0.431 | −1.145 | 0.601 | 0.431 | −0.335 | 0.101 | 0.431 |
| 1.243 | −0.586 | 0.431 | −1.173 | 0.646 | 0.431 | −0.257 | 0.057 | 0.431 |
| 1.225 | −0.582 | 0.431 | −1.197 | 0.686 | 0.431 | −0.179 | 0.015 | 0.431 |
| 1.201 | −0.576 | 0.431 | −1.216 | 0.721 | 0.431 | −0.099 | −0.026 | 0.431 |
| 1.171 | −0.570 | 0.431 | −1.232 | 0.751 | 0.431 | −0.019 | −0.065 | 0.431 |
| 1.132 | −0.561 | 0.431 | −1.245 | 0.777 | 0.431 | 0.062 | −0.102 | 0.431 |
| 1.087 | −0.551 | 0.431 | −1.255 | 0.800 | 0.431 | 0.143 | −0.138 | 0.431 |
| 1.039 | −0.540 | 0.431 | −1.263 | 0.819 | 0.431 | 0.224 | −0.173 | 0.431 |
| 0.985 | −0.527 | 0.431 | −1.269 | 0.834 | 0.431 | 0.306 | −0.208 | 0.431 |
| 0.926 | −0.513 | 0.431 | −1.271 | 0.846 | 0.431 | 0.389 | −0.242 | 0.431 |
| 0.860 | −0.498 | 0.431 | −1.272 | 0.855 | 0.431 | 0.468 | −0.273 | 0.431 |
| 0.791 | −0.481 | 0.431 | −1.272 | 0.863 | 0.431 | 0.546 | −0.304 | 0.431 |
| 0.720 | −0.463 | 0.431 | −1.269 | 0.869 | 0.431 | 0.620 | −0.333 | 0.431 |
| 0.645 | −0.445 | 0.431 | −1.266 | 0.872 | 0.431 | 0.692 | −0.360 | 0.431 |
| 0.568 | −0.425 | 0.431 | −1.262 | 0.874 | 0.431 | 0.762 | −0.386 | 0.431 |
| 0.488 | −0.404 | 0.431 | −1.256 | 0.874 | 0.431 | 0.829 | −0.410 | 0.431 |
| 0.405 | −0.381 | 0.431 | −1.249 | 0.872 | 0.431 | 0.893 | −0.433 | 0.431 |
| 0.319 | −0.357 | 0.431 | −1.241 | 0.868 | 0.431 | 0.955 | −0.455 | 0.431 |
| 0.231 | −0.331 | 0.431 | −1.231 | 0.861 | 0.431 | 1.011 | −0.474 | 0.431 |
| 0.144 | −0.304 | 0.431 | −1.220 | 0.851 | 0.431 | 1.061 | −0.491 | 0.431 |
| 0.057 | −0.275 | 0.431 | −1.206 | 0.837 | 0.431 | 1.106 | −0.506 | 0.431 |
| −0.030 | −0.244 | 0.431 | −1.189 | 0.820 | 0.431 | 1.149 | −0.520 | 0.431 |
| −0.115 | −0.212 | 0.431 | −1.170 | 0.800 | 0.431 | 1.185 | −0.532 | 0.431 |
| −0.200 | −0.176 | 0.431 | −1.147 | 0.776 | 0.431 | 1.214 | −0.541 | 0.431 |
| −0.284 | −0.138 | 0.431 | −1.121 | 0.748 | 0.431 | 1.236 | −0.549 | 0.431 |
| −0.367 | −0.097 | 0.431 | −1.090 | 0.716 | 0.431 | 1.253 | −0.554 | 0.431 |
| −0.448 | −0.052 | 0.431 | −1.055 | 0.679 | 0.431 | 1.265 | −0.560 | 0.431 |
| −0.528 | −0.004 | 0.431 | −1.015 | 0.639 | 0.431 | 1.268 | −0.566 | 0.431 |
| −0.605 | 0.047 | 0.431 | −0.971 | 0.595 | 0.431 | 1.269 | −0.571 | 0.431 |
| −0.680 | 0.101 | 0.431 | −0.922 | 0.547 | 0.431 | 1.269 | −0.574 | 0.431 |

TABLE 15S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.749 | 0.157 | 0.431 | −0.870 | 0.498 | 0.431 | 1.269 | −0.575 | 0.431 |
| −0.814 | 0.214 | 0.431 | −0.814 | 0.449 | 0.431 | 1.268 | −0.575 | 0.431 |
| −0.874 | 0.271 | 0.431 | −0.756 | 0.398 | 0.431 | | | |
| −0.930 | 0.328 | 0.431 | −0.694 | 0.348 | 0.431 | | | |
| 1.268 | −0.409 | 0.862 | −0.941 | 0.462 | 0.862 | −0.606 | 0.388 | 0.862 |
| 1.268 | −0.410 | 0.862 | −0.992 | 0.512 | 0.862 | −0.536 | 0.342 | 0.862 |
| 1.267 | −0.413 | 0.862 | −1.039 | 0.562 | 0.862 | −0.464 | 0.297 | 0.862 |
| 1.264 | −0.416 | 0.862 | −1.081 | 0.609 | 0.862 | −0.390 | 0.253 | 0.862 |
| 1.257 | −0.419 | 0.862 | −1.118 | 0.652 | 0.862 | −0.314 | 0.211 | 0.862 |
| 1.244 | −0.417 | 0.862 | −1.149 | 0.692 | 0.862 | −0.238 | 0.171 | 0.862 |
| 1.226 | −0.414 | 0.862 | −1.176 | 0.728 | 0.862 | −0.161 | 0.133 | 0.862 |
| 1.203 | −0.409 | 0.862 | −1.199 | 0.759 | 0.862 | −0.083 | 0.095 | 0.862 |
| 1.174 | −0.403 | 0.862 | −1.218 | 0.786 | 0.862 | −0.004 | 0.060 | 0.862 |
| 1.136 | −0.395 | 0.862 | −1.233 | 0.810 | 0.862 | 0.076 | 0.025 | 0.862 |
| 1.092 | −0.386 | 0.862 | −1.246 | 0.830 | 0.862 | 0.156 | −0.009 | 0.862 |
| 1.046 | −0.376 | 0.862 | −1.255 | 0.847 | 0.862 | 0.237 | −0.041 | 0.862 |
| 0.994 | −0.365 | 0.862 | −1.263 | 0.861 | 0.862 | 0.318 | −0.073 | 0.862 |
| 0.936 | −0.352 | 0.862 | −1.267 | 0.872 | 0.862 | 0.399 | −0.104 | 0.862 |
| 0.872 | −0.338 | 0.862 | −1.270 | 0.881 | 0.862 | 0.478 | −0.133 | 0.862 |
| 0.805 | −0.322 | 0.862 | −1.270 | 0.888 | 0.862 | 0.554 | −0.161 | 0.862 |
| 0.736 | −0.306 | 0.862 | −1.269 | 0.894 | 0.862 | 0.628 | −0.187 | 0.862 |
| 0.664 | −0.289 | 0.862 | −1.266 | 0.898 | 0.862 | 0.699 | −0.212 | 0.862 |
| 0.589 | −0.271 | 0.862 | −1.262 | 0.900 | 0.862 | 0.768 | −0.236 | 0.862 |
| 0.511 | −0.251 | 0.862 | −1.256 | 0.900 | 0.862 | 0.833 | −0.258 | 0.862 |
| 0.430 | −0.230 | 0.862 | −1.249 | 0.898 | 0.862 | 0.897 | −0.279 | 0.862 |
| 0.347 | −0.208 | 0.862 | −1.242 | 0.895 | 0.862 | 0.957 | −0.299 | 0.862 |
| 0.262 | −0.184 | 0.862 | −1.232 | 0.889 | 0.862 | 1.013 | −0.317 | 0.862 |
| 0.176 | −0.158 | 0.862 | −1.220 | 0.879 | 0.862 | 1.062 | −0.332 | 0.862 |
| 0.092 | −0.131 | 0.862 | −1.205 | 0.868 | 0.862 | 1.107 | −0.346 | 0.862 |
| 0.008 | −0.103 | 0.862 | −1.188 | 0.853 | 0.862 | 1.148 | −0.359 | 0.862 |
| −0.075 | −0.073 | 0.862 | −1.167 | 0.835 | 0.862 | 1.184 | −0.370 | 0.862 |
| −0.158 | −0.041 | 0.862 | −1.143 | 0.814 | 0.862 | 1.212 | −0.378 | 0.862 |
| −0.240 | −0.006 | 0.862 | −1.115 | 0.789 | 0.862 | 1.234 | −0.385 | 0.862 |
| −0.320 | 0.031 | 0.862 | −1.082 | 0.760 | 0.862 | 1.251 | −0.390 | 0.862 |
| −0.400 | 0.071 | 0.862 | −1.045 | 0.728 | 0.862 | 1.263 | −0.394 | 0.862 |
| −0.478 | 0.114 | 0.862 | −1.003 | 0.692 | 0.862 | 1.268 | −0.400 | 0.862 |
| −0.555 | 0.160 | 0.862 | −0.957 | 0.653 | 0.862 | 1.269 | −0.405 | 0.862 |
| −0.631 | 0.208 | 0.862 | −0.906 | 0.611 | 0.862 | 1.269 | −0.407 | 0.862 |
| −0.701 | 0.258 | 0.862 | −0.852 | 0.567 | 0.862 | 1.268 | −0.408 | 0.862 |
| −0.767 | 0.309 | 0.862 | −0.795 | 0.523 | 0.862 | 1.268 | −0.409 | 0.862 |
| −0.829 | 0.360 | 0.862 | −0.735 | 0.478 | 0.862 | | | |
| −0.887 | 0.411 | 0.862 | −0.672 | 0.433 | 0.862 | | | |
| 1.256 | −0.288 | 1.294 | −0.920 | 0.544 | 1.294 | −0.589 | 0.473 | 1.294 |
| 1.255 | −0.289 | 1.294 | −0.971 | 0.593 | 1.294 | −0.519 | 0.429 | 1.294 |
| 1.254 | −0.292 | 1.294 | −1.018 | 0.641 | 1.294 | −0.446 | 0.385 | 1.294 |
| 1.251 | −0.295 | 1.294 | −1.060 | 0.686 | 1.294 | −0.372 | 0.343 | 1.294 |
| 1.244 | −0.298 | 1.294 | −1.097 | 0.728 | 1.294 | −0.297 | 0.302 | 1.294 |
| 1.231 | −0.296 | 1.294 | −1.129 | 0.767 | 1.294 | −0.222 | 0.263 | 1.294 |
| 1.214 | −0.293 | 1.294 | −1.157 | 0.801 | 1.294 | −0.146 | 0.226 | 1.294 |
| 1.191 | −0.289 | 1.294 | −1.180 | 0.832 | 1.294 | −0.069 | 0.190 | 1.294 |
| 1.163 | −0.284 | 1.294 | −1.199 | 0.858 | 1.294 | 0.008 | 0.155 | 1.294 |
| 1.125 | −0.277 | 1.294 | −1.215 | 0.881 | 1.294 | 0.086 | 0.122 | 1.294 |
| 1.082 | −0.269 | 1.294 | −1.228 | 0.900 | 1.294 | 0.165 | 0.090 | 1.294 |
| 1.037 | −0.260 | 1.294 | −1.238 | 0.917 | 1.294 | 0.243 | 0.058 | 1.294 |
| 0.985 | −0.250 | 1.294 | −1.246 | 0.930 | 1.294 | 0.323 | 0.028 | 1.294 |
| 0.928 | −0.238 | 1.294 | −1.251 | 0.941 | 1.294 | 0.402 | −0.002 | 1.294 |
| 0.865 | −0.225 | 1.294 | −1.253 | 0.949 | 1.294 | 0.479 | −0.030 | 1.294 |
| 0.800 | −0.211 | 1.294 | −1.254 | 0.956 | 1.294 | 0.554 | −0.057 | 1.294 |
| 0.732 | −0.196 | 1.294 | −1.253 | 0.962 | 1.294 | 0.626 | −0.082 | 1.294 |
| 0.661 | −0.180 | 1.294 | −1.251 | 0.966 | 1.294 | 0.696 | −0.106 | 1.294 |
| 0.588 | −0.163 | 1.294 | −1.247 | 0.968 | 1.294 | 0.763 | −0.128 | 1.294 |
| 0.511 | −0.144 | 1.294 | −1.241 | 0.968 | 1.294 | 0.828 | −0.149 | 1.294 |
| 0.433 | −0.124 | 1.294 | −1.234 | 0.966 | 1.294 | 0.890 | −0.169 | 1.294 |
| 0.351 | −0.103 | 1.294 | −1.227 | 0.963 | 1.294 | 0.949 | −0.187 | 1.294 |
| 0.268 | −0.080 | 1.294 | −1.217 | 0.957 | 1.294 | 1.004 | −0.203 | 1.294 |
| 0.184 | −0.055 | 1.294 | −1.205 | 0.948 | 1.294 | 1.053 | −0.218 | 1.294 |
| 0.101 | −0.029 | 1.294 | −1.191 | 0.936 | 1.294 | 1.096 | −0.230 | 1.294 |
| 0.019 | −0.001 | 1.294 | −1.173 | 0.922 | 1.294 | 1.137 | −0.242 | 1.294 |
| −0.063 | 0.028 | 1.294 | −1.152 | 0.905 | 1.294 | 1.173 | −0.252 | 1.294 |
| −0.144 | 0.060 | 1.294 | −1.128 | 0.885 | 1.294 | 1.200 | −0.260 | 1.294 |
| −0.225 | 0.093 | 1.294 | −1.100 | 0.861 | 1.294 | 1.222 | −0.265 | 1.294 |
| −0.304 | 0.130 | 1.294 | −1.068 | 0.833 | 1.294 | 1.238 | −0.270 | 1.294 |
| −0.383 | 0.169 | 1.294 | −1.030 | 0.802 | 1.294 | 1.251 | −0.274 | 1.294 |
| −0.461 | 0.211 | 1.294 | −0.989 | 0.767 | 1.294 | 1.255 | −0.279 | 1.294 |
| −0.537 | 0.255 | 1.294 | −0.942 | 0.729 | 1.294 | 1.256 | −0.284 | 1.294 |
| −0.611 | 0.302 | 1.294 | −0.891 | 0.688 | 1.294 | 1.256 | −0.286 | 1.294 |
| −0.681 | 0.350 | 1.294 | −0.837 | 0.647 | 1.294 | 1.256 | −0.287 | 1.294 |

TABLE 15S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.746 | 0.398 | 1.294 | −0.780 | 0.604 | 1.294 | 1.256 | −0.288 | 1.294 |
| −0.808 | 0.447 | 1.294 | −0.719 | 0.561 | 1.294 | | | |
| −0.866 | 0.496 | 1.294 | −0.656 | 0.517 | 1.294 | | | |
| 1.235 | −0.268 | 1.725 | −0.898 | 0.590 | 1.725 | −0.585 | 0.502 | 1.725 |
| 1.235 | −0.269 | 1.725 | −0.947 | 0.637 | 1.725 | −0.516 | 0.457 | 1.725 |
| 1.234 | −0.271 | 1.725 | −0.994 | 0.684 | 1.725 | −0.445 | 0.413 | 1.725 |
| 1.231 | −0.275 | 1.725 | −1.035 | 0.729 | 1.725 | −0.372 | 0.370 | 1.725 |
| 1.224 | −0.277 | 1.725 | −1.072 | 0.770 | 1.725 | −0.299 | 0.329 | 1.725 |
| 1.211 | −0.276 | 1.725 | −1.104 | 0.807 | 1.725 | −0.225 | 0.289 | 1.725 |
| 1.194 | −0.272 | 1.725 | −1.131 | 0.841 | 1.725 | −0.149 | 0.250 | 1.725 |
| 1.172 | −0.268 | 1.725 | −1.154 | 0.871 | 1.725 | −0.074 | 0.213 | 1.725 |
| 1.143 | −0.263 | 1.725 | −1.174 | 0.896 | 1.725 | 0.002 | 0.178 | 1.725 |
| 1.107 | −0.256 | 1.725 | −1.189 | 0.919 | 1.725 | 0.079 | 0.144 | 1.725 |
| 1.064 | −0.248 | 1.725 | −1.202 | 0.938 | 1.725 | 0.156 | 0.110 | 1.725 |
| 1.019 | −0.239 | 1.725 | −1.213 | 0.953 | 1.725 | 0.234 | 0.078 | 1.725 |
| 0.968 | −0.228 | 1.725 | −1.221 | 0.966 | 1.725 | 0.312 | 0.047 | 1.725 |
| 0.912 | −0.216 | 1.725 | −1.226 | 0.977 | 1.725 | 0.390 | 0.016 | 1.725 |
| 0.850 | −0.202 | 1.725 | −1.229 | 0.985 | 1.725 | 0.466 | −0.012 | 1.725 |
| 0.786 | −0.188 | 1.725 | −1.231 | 0.992 | 1.725 | 0.540 | −0.039 | 1.725 |
| 0.719 | −0.172 | 1.725 | −1.230 | 0.998 | 1.725 | 0.611 | −0.065 | 1.725 |
| 0.649 | −0.155 | 1.725 | −1.228 | 1.001 | 1.725 | 0.680 | −0.088 | 1.725 |
| 0.576 | −0.136 | 1.725 | −1.224 | 1.003 | 1.725 | 0.747 | −0.111 | 1.725 |
| 0.501 | −0.117 | 1.725 | −1.218 | 1.003 | 1.725 | 0.811 | −0.132 | 1.725 |
| 0.424 | −0.095 | 1.725 | −1.212 | 1.001 | 1.725 | 0.872 | −0.151 | 1.725 |
| 0.344 | −0.072 | 1.725 | −1.204 | 0.996 | 1.725 | 0.931 | −0.169 | 1.725 |
| 0.262 | −0.047 | 1.725 | −1.195 | 0.990 | 1.725 | 0.985 | −0.185 | 1.725 |
| 0.180 | −0.020 | 1.725 | −1.184 | 0.981 | 1.725 | 1.034 | −0.200 | 1.725 |
| 0.099 | 0.007 | 1.725 | −1.170 | 0.969 | 1.725 | 1.077 | −0.212 | 1.725 |
| 0.018 | 0.037 | 1.725 | −1.153 | 0.954 | 1.725 | 1.118 | −0.223 | 1.725 |
| −0.061 | 0.068 | 1.725 | −1.133 | 0.937 | 1.725 | 1.153 | −0.233 | 1.725 |
| −0.141 | 0.101 | 1.725 | −1.110 | 0.916 | 1.725 | 1.180 | −0.240 | 1.725 |
| −0.219 | 0.136 | 1.725 | −1.082 | 0.892 | 1.725 | 1.202 | −0.246 | 1.725 |
| −0.297 | 0.174 | 1.725 | −1.051 | 0.864 | 1.725 | 1.218 | −0.250 | 1.725 |
| −0.373 | 0.214 | 1.725 | −1.015 | 0.833 | 1.725 | 1.230 | −0.254 | 1.725 |
| −0.449 | 0.256 | 1.725 | −0.974 | 0.798 | 1.725 | 1.235 | −0.259 | 1.725 |
| −0.523 | 0.301 | 1.725 | −0.929 | 0.760 | 1.725 | 1.236 | −0.264 | 1.725 |
| −0.595 | 0.349 | 1.725 | −0.879 | 0.719 | 1.725 | 1.236 | −0.266 | 1.725 |
| −0.664 | 0.397 | 1.725 | −0.826 | 0.677 | 1.725 | 1.236 | −0.267 | 1.725 |
| −0.728 | 0.445 | 1.725 | −0.770 | 0.634 | 1.725 | 1.235 | −0.267 | 1.725 |
| −0.788 | 0.493 | 1.725 | −0.712 | 0.590 | 1.725 | | | |
| −0.845 | 0.541 | 1.725 | −0.650 | 0.546 | 1.725 | | | |
| 1.208 | −0.343 | 2.156 | −0.866 | 0.533 | 2.156 | −0.574 | 0.426 | 2.156 |
| 1.208 | −0.344 | 2.156 | −0.915 | 0.580 | 2.156 | −0.508 | 0.381 | 2.156 |
| 1.207 | −0.346 | 2.156 | −0.961 | 0.626 | 2.156 | −0.438 | 0.336 | 2.156 |
| 1.204 | −0.350 | 2.156 | −1.001 | 0.669 | 2.156 | −0.367 | 0.293 | 2.156 |
| 1.197 | −0.352 | 2.156 | −1.038 | 0.709 | 2.156 | −0.296 | 0.251 | 2.156 |
| 1.185 | −0.350 | 2.156 | −1.069 | 0.745 | 2.156 | −0.223 | 0.211 | 2.156 |
| 1.168 | −0.347 | 2.156 | −1.097 | 0.778 | 2.156 | −0.150 | 0.172 | 2.156 |
| 1.146 | −0.343 | 2.156 | −1.120 | 0.806 | 2.156 | −0.076 | 0.135 | 2.156 |
| 1.118 | −0.337 | 2.156 | −1.139 | 0.831 | 2.156 | −0.002 | 0.099 | 2.156 |
| 1.083 | −0.330 | 2.156 | −1.155 | 0.852 | 2.156 | 0.073 | 0.065 | 2.156 |
| 1.041 | −0.321 | 2.156 | −1.168 | 0.870 | 2.156 | 0.149 | 0.031 | 2.156 |
| 0.997 | −0.312 | 2.156 | −1.178 | 0.886 | 2.156 | 0.225 | −0.001 | 2.156 |
| 0.948 | −0.301 | 2.156 | −1.187 | 0.898 | 2.156 | 0.301 | −0.032 | 2.156 |
| 0.893 | −0.288 | 2.156 | −1.192 | 0.908 | 2.156 | 0.378 | −0.063 | 2.156 |
| 0.832 | −0.274 | 2.156 | −1.196 | 0.915 | 2.156 | 0.452 | −0.092 | 2.156 |
| 0.769 | −0.259 | 2.156 | −1.198 | 0.922 | 2.156 | 0.524 | −0.119 | 2.156 |
| 0.704 | −0.242 | 2.156 | −1.198 | 0.928 | 2.156 | 0.594 | −0.144 | 2.156 |
| 0.636 | −0.224 | 2.156 | −1.196 | 0.932 | 2.156 | 0.662 | −0.168 | 2.156 |
| 0.565 | −0.204 | 2.156 | −1.193 | 0.933 | 2.156 | 0.727 | −0.190 | 2.156 |
| 0.492 | −0.183 | 2.156 | −1.187 | 0.932 | 2.156 | 0.790 | −0.210 | 2.156 |
| 0.417 | −0.160 | 2.156 | −1.181 | 0.929 | 2.156 | 0.851 | −0.230 | 2.156 |
| 0.340 | −0.136 | 2.156 | −1.174 | 0.925 | 2.156 | 0.909 | −0.247 | 2.156 |
| 0.260 | −0.109 | 2.156 | −1.165 | 0.918 | 2.156 | 0.962 | −0.263 | 2.156 |
| 0.181 | −0.081 | 2.156 | −1.154 | 0.908 | 2.156 | 1.010 | −0.277 | 2.156 |
| 0.102 | −0.052 | 2.156 | −1.141 | 0.896 | 2.156 | 1.052 | −0.289 | 2.156 |
| 0.024 | −0.022 | 2.156 | −1.125 | 0.881 | 2.156 | 1.092 | −0.300 | 2.156 |
| −0.054 | 0.011 | 2.156 | −1.106 | 0.864 | 2.156 | 1.127 | −0.309 | 2.156 |
| −0.130 | 0.045 | 2.156 | −1.084 | 0.843 | 2.156 | 1.153 | −0.316 | 2.156 |
| −0.206 | 0.081 | 2.156 | −1.057 | 0.818 | 2.156 | 1.175 | −0.322 | 2.156 |
| −0.281 | 0.119 | 2.156 | −1.027 | 0.790 | 2.156 | 1.191 | −0.326 | 2.156 |
| −0.356 | 0.160 | 2.156 | −0.992 | 0.759 | 2.156 | 1.203 | −0.329 | 2.156 |
| −0.429 | 0.203 | 2.156 | −0.952 | 0.724 | 2.156 | 1.207 | −0.334 | 2.156 |
| −0.501 | 0.248 | 2.156 | −0.909 | 0.685 | 2.156 | 1.209 | −0.339 | 2.156 |
| −0.571 | 0.295 | 2.156 | −0.860 | 0.644 | 2.156 | 1.209 | −0.341 | 2.156 |
| −0.637 | 0.343 | 2.156 | −0.809 | 0.602 | 2.156 | 1.208 | −0.342 | 2.156 |
| −0.700 | 0.390 | 2.156 | −0.755 | 0.559 | 2.156 | 1.208 | −0.343 | 2.156 |

TABLE 15S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.759 | 0.438 | 2.156 | −0.698 | 0.515 | 2.156 | | | |
| −0.814 | 0.486 | 2.156 | −0.638 | 0.470 | 2.156 | | | |
| 1.191 | −0.401 | 2.372 | −0.850 | 0.474 | 2.372 | −0.585 | 0.372 | 2.372 |
| 1.191 | −0.402 | 2.372 | −0.898 | 0.520 | 2.372 | −0.500 | 0.327 | 2.372 |
| 1.190 | −0.404 | 2.372 | −0.943 | 0.566 | 2.372 | −0.432 | 0.283 | 2.372 |
| 1.187 | −0.407 | 2.372 | −0.983 | 0.608 | 2.372 | −0.363 | 0.240 | 2.372 |
| 1.181 | −0.409 | 2.372 | −1.019 | 0.648 | 2.372 | −0.294 | 0.199 | 2.372 |
| 1.168 | −0.408 | 2.372 | −1.050 | 0.684 | 2.372 | −0.223 | 0.159 | 2.372 |
| 1.152 | −0.405 | 2.372 | −1.077 | 0.716 | 2.372 | −0.152 | 0.120 | 2.372 |
| 1.130 | −0.401 | 2.372 | −1.100 | 0.744 | 2.372 | −0.079 | 0.082 | 2.372 |
| 1.103 | −0.395 | 2.372 | −1.119 | 0.768 | 2.372 | −0.006 | 0.046 | 2.372 |
| 1.067 | −0.388 | 2.372 | −1.135 | 0.790 | 2.372 | 0.068 | 0.011 | 2.372 |
| 1.027 | −0.380 | 2.372 | −1.148 | 0.807 | 2.372 | 0.143 | −0.023 | 2.372 |
| 0.983 | −0.371 | 2.372 | −1.158 | 0.822 | 2.372 | 0.218 | −0.056 | 2.372 |
| 0.934 | −0.360 | 2.372 | −1.166 | 0.835 | 2.372 | 0.293 | −0.088 | 2.372 |
| 0.880 | −0.347 | 2.372 | −1.172 | 0.844 | 2.372 | 0.369 | −0.119 | 2.372 |
| 0.820 | −0.333 | 2.372 | −1.175 | 0.852 | 2.372 | 0.443 | −0.148 | 2.372 |
| 0.758 | −0.318 | 2.372 | −1.177 | 0.859 | 2.372 | 0.514 | −0.175 | 2.372 |
| 0.694 | −0.301 | 2.372 | −1.178 | 0.864 | 2.372 | 0.584 | −0.201 | 2.372 |
| 0.627 | −0.283 | 2.372 | −1.176 | 0.868 | 2.372 | 0.650 | −0.225 | 2.372 |
| 0.557 | −0.264 | 2.372 | −1.172 | 0.869 | 2.372 | 0.715 | −0.247 | 2.372 |
| 0.485 | −0.243 | 2.372 | −1.167 | 0.868 | 2.372 | 0.777 | −0.268 | 2.372 |
| 0.411 | −0.220 | 2.372 | −1.161 | 0.865 | 2.372 | 0.837 | −0.287 | 2.372 |
| 0.335 | −0.195 | 2.372 | −1.154 | 0.861 | 2.372 | 0.895 | −0.305 | 2.372 |
| 0.256 | −0.169 | 2.372 | −1.145 | 0.854 | 2.372 | 0.947 | −0.321 | 2.372 |
| 0.178 | −0.141 | 2.372 | −1.134 | 0.845 | 2.372 | 0.994 | −0.335 | 2.372 |
| 0.101 | −0.111 | 2.372 | −1.121 | 0.833 | 2.372 | 1.036 | −0.346 | 2.372 |
| 0.024 | −0.080 | 2.372 | −1.105 | 0.819 | 2.372 | 1.076 | −0.357 | 2.372 |
| −0.052 | −0.048 | 2.372 | −1.086 | 0.801 | 2.372 | 1.110 | −0.367 | 2.372 |
| −0.127 | −0.013 | 2.372 | −1.064 | 0.781 | 2.372 | 1.137 | −0.374 | 2.372 |
| −0.202 | 0.023 | 2.372 | −1.038 | 0.757 | 2.372 | 1.158 | −0.379 | 2.372 |
| −0.276 | 0.062 | 2.372 | −1.008 | 0.729 | 2.372 | 1.174 | −0.384 | 2.372 |
| −0.349 | 0.103 | 2.372 | −0.973 | 0.698 | 2.372 | 1.186 | −0.387 | 2.372 |
| −0.421 | 0.146 | 2.372 | −0.935 | 0.664 | 2.372 | 1.190 | −0.392 | 2.372 |
| −0.491 | 0.191 | 2.372 | −0.891 | 0.626 | 2.372 | 1.191 | −0.396 | 2.372 |
| −0.560 | 0.238 | 2.372 | −0.844 | 0.586 | 2.372 | 1.192 | −0.398 | 2.372 |
| −0.625 | 0.285 | 2.372 | −0.793 | 0.544 | 2.372 | 1.191 | −0.399 | 2.372 |
| −0.686 | 0.333 | 2.372 | −0.741 | 0.502 | 2.372 | 1.191 | −0.400 | 2.372 |
| −0.744 | 0.380 | 2.372 | −0.685 | 0.459 | 2.372 | | | |
| −0.799 | 0.428 | 2.372 | −0.626 | 0.415 | 2.372 | | | |
| 1.169 | −0.462 | 2.587 | −0.838 | 0.406 | 2.587 | −0.546 | 0.316 | 2.587 |
| 1.169 | −0.463 | 2.587 | −0.885 | 0.452 | 2.587 | −0.482 | 0.272 | 2.587 |
| 1.168 | −0.465 | 2.587 | −0.929 | 0.498 | 2.587 | −0.415 | 0.227 | 2.587 |
| 1.165 | −0.468 | 2.587 | −0.968 | 0.540 | 2.587 | −0.348 | 0.184 | 2.587 |
| 1.158 | −0.471 | 2.587 | −1.003 | 0.580 | 2.587 | −0.279 | 0.142 | 2.587 |
| 1.146 | −0.469 | 2.587 | −1.033 | 0.616 | 2.587 | −0.210 | 0.102 | 2.587 |
| 1.130 | −0.466 | 2.587 | −1.059 | 0.648 | 2.587 | −0.140 | 0.063 | 2.587 |
| 1.108 | −0.462 | 2.587 | −1.081 | 0.676 | 2.587 | −0.069 | 0.025 | 2.587 |
| 1.081 | −0.458 | 2.587 | −1.099 | 0.701 | 2.587 | 0.002 | −0.011 | 2.587 |
| 1.046 | −0.451 | 2.587 | −1.114 | 0.722 | 2.587 | 0.074 | −0.047 | 2.587 |
| 1.006 | −0.443 | 2.587 | −1.127 | 0.740 | 2.587 | 0.147 | −0.081 | 2.587 |
| 0.963 | −0.435 | 2.587 | −1.137 | 0.755 | 2.587 | 0.220 | −0.114 | 2.587 |
| 0.914 | −0.424 | 2.587 | −1.144 | 0.767 | 2.587 | 0.293 | −0.147 | 2.587 |
| 0.861 | −0.413 | 2.587 | −1.149 | 0.777 | 2.587 | 0.367 | −0.178 | 2.587 |
| 0.802 | −0.399 | 2.587 | −1.152 | 0.785 | 2.587 | 0.439 | −0.208 | 2.587 |
| 0.741 | −0.385 | 2.587 | −1.154 | 0.791 | 2.587 | 0.508 | −0.235 | 2.587 |
| 0.677 | −0.369 | 2.587 | −1.154 | 0.797 | 2.587 | 0.576 | −0.261 | 2.587 |
| 0.611 | −0.352 | 2.587 | −1.152 | 0.801 | 2.587 | 0.641 | −0.285 | 2.587 |
| 0.543 | −0.333 | 2.587 | −1.149 | 0.802 | 2.587 | 0.704 | −0.308 | 2.587 |
| 0.472 | −0.312 | 2.587 | −1.143 | 0.801 | 2.587 | 0.765 | −0.329 | 2.587 |
| 0.399 | −0.290 | 2.587 | −1.137 | 0.799 | 2.587 | 0.823 | −0.348 | 2.587 |
| 0.324 | −0.266 | 2.587 | −1.130 | 0.795 | 2.587 | 0.879 | −0.366 | 2.587 |
| 0.246 | −0.240 | 2.587 | −1.121 | 0.789 | 2.587 | 0.930 | −0.382 | 2.587 |
| 0.169 | −0.212 | 2.587 | −1.110 | 0.780 | 2.587 | 0.977 | −0.396 | 2.587 |
| 0.093 | −0.183 | 2.587 | −1.097 | 0.769 | 2.587 | 1.018 | −0.408 | 2.587 |
| 0.017 | −0.152 | 2.587 | −1.081 | 0.755 | 2.587 | 1.056 | −0.419 | 2.587 |
| −0.058 | −0.119 | 2.587 | −1.062 | 0.738 | 2.587 | 1.090 | −0.428 | 2.587 |
| −0.132 | −0.085 | 2.587 | −1.040 | 0.719 | 2.587 | 1.116 | −0.435 | 2.587 |
| −0.206 | −0.048 | 2.587 | −1.014 | 0.695 | 2.587 | 1.137 | −0.441 | 2.587 |
| −0.278 | −0.008 | 2.587 | −0.984 | 0.669 | 2.587 | 1.152 | −0.445 | 2.587 |
| −0.350 | 0.033 | 2.587 | −0.950 | 0.638 | 2.587 | 1.164 | −0.449 | 2.587 |
| −0.420 | 0.077 | 2.587 | −0.912 | 0.605 | 2.587 | 1.168 | −0.453 | 2.587 |
| −0.489 | 0.122 | 2.587 | −0.869 | 0.568 | 2.587 | 1.169 | −0.458 | 2.587 |
| −0.556 | 0.169 | 2.587 | −0.822 | 0.529 | 2.587 | 1.169 | −0.460 | 2.587 |
| −0.619 | 0.217 | 2.587 | −0.772 | 0.488 | 2.587 | 1.169 | −0.461 | 2.587 |
| −0.678 | 0.265 | 2.587 | −0.720 | 0.446 | 2.587 | 1.169 | −0.461 | 2.587 |
| −0.735 | 0.312 | 2.587 | −0.665 | 0.403 | 2.587 | | | |

TABLE 15S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.788 | 0.359 | 2.587 | −0.607 | 0.360 | 2.587 | | | |
| 1.143 | −0.527 | 2.803 | −0.833 | 0.344 | 2.803 | −0.533 | 0.265 | 2.803 |
| 1.143 | −0.529 | 2.803 | −0.877 | 0.392 | 2.803 | −0.471 | 0.221 | 2.803 |
| 1.142 | −0.531 | 2.803 | −0.919 | 0.439 | 2.803 | −0.406 | 0.175 | 2.803 |
| 1.139 | −0.534 | 2.803 | −0.956 | 0.483 | 2.803 | −0.340 | 0.131 | 2.803 |
| 1.133 | −0.536 | 2.803 | −0.989 | 0.523 | 2.803 | −0.274 | 0.089 | 2.803 |
| 1.121 | −0.535 | 2.803 | −1.017 | 0.560 | 2.803 | −0.207 | 0.048 | 2.803 |
| 1.105 | −0.533 | 2.803 | −1.042 | 0.593 | 2.803 | −0.138 | 0.008 | 2.803 |
| 1.083 | −0.529 | 2.803 | −1.062 | 0.622 | 2.803 | −0.069 | −0.031 | 2.803 |
| 1.056 | −0.525 | 2.803 | −1.079 | 0.647 | 2.803 | 0.000 | −0.069 | 2.803 |
| 1.021 | −0.519 | 2.803 | −1.093 | 0.669 | 2.803 | 0.071 | −0.105 | 2.803 |
| 0.981 | −0.512 | 2.803 | −1.104 | 0.687 | 2.803 | 0.141 | −0.140 | 2.803 |
| 0.938 | −0.504 | 2.803 | −1.113 | 0.702 | 2.803 | 0.213 | −0.175 | 2.803 |
| 0.890 | −0.495 | 2.803 | −1.120 | 0.715 | 2.803 | 0.284 | −0.208 | 2.803 |
| 0.837 | −0.484 | 2.803 | −1.124 | 0.725 | 2.803 | 0.356 | −0.240 | 2.803 |
| 0.778 | −0.472 | 2.803 | −1.127 | 0.733 | 2.803 | 0.426 | −0.270 | 2.803 |
| 0.717 | −0.458 | 2.803 | −1.128 | 0.740 | 2.803 | 0.494 | −0.299 | 2.803 |
| 0.654 | −0.443 | 2.803 | −1.127 | 0.745 | 2.803 | 0.560 | −0.325 | 2.803 |
| 0.588 | −0.427 | 2.803 | −1.125 | 0.749 | 2.803 | 0.624 | −0.350 | 2.803 |
| 0.520 | −0.409 | 2.803 | −1.121 | 0.750 | 2.803 | 0.686 | −0.373 | 2.803 |
| 0.449 | −0.390 | 2.803 | −1.116 | 0.750 | 2.803 | 0.745 | −0.394 | 2.803 |
| 0.377 | −0.368 | 2.803 | −1.110 | 0.748 | 2.803 | 0.803 | −0.414 | 2.803 |
| 0.302 | −0.345 | 2.803 | −1.103 | 0.744 | 2.803 | 0.858 | −0.432 | 2.803 |
| 0.225 | −0.319 | 2.803 | −1.094 | 0.738 | 2.803 | 0.908 | −0.448 | 2.803 |
| 0.149 | −0.291 | 2.803 | −1.083 | 0.730 | 2.803 | 0.954 | −0.462 | 2.803 |
| 0.074 | −0.262 | 2.803 | −1.070 | 0.719 | 2.803 | 0.994 | −0.474 | 2.803 |
| −0.001 | −0.231 | 2.803 | −1.054 | 0.705 | 2.803 | 1.032 | −0.485 | 2.803 |
| −0.075 | −0.198 | 2.803 | −1.036 | 0.689 | 2.803 | 1.065 | −0.494 | 2.803 |
| −0.149 | −0.163 | 2.803 | −1.014 | 0.670 | 2.803 | 1.091 | −0.501 | 2.803 |
| −0.221 | −0.124 | 2.803 | −0.988 | 0.647 | 2.803 | 1.111 | −0.507 | 2.803 |
| −0.293 | −0.084 | 2.803 | −0.959 | 0.620 | 2.803 | 1.127 | −0.511 | 2.803 |
| −0.362 | −0.041 | 2.803 | −0.925 | 0.590 | 2.803 | 1.138 | −0.514 | 2.803 |
| −0.431 | 0.004 | 2.803 | −0.888 | 0.557 | 2.803 | 1.142 | −0.519 | 2.803 |
| −0.497 | 0.050 | 2.803 | −0.846 | 0.520 | 2.803 | 1.144 | −0.523 | 2.803 |
| −0.562 | 0.099 | 2.803 | −0.800 | 0.480 | 2.803 | 1.144 | −0.525 | 2.803 |
| −0.623 | 0.149 | 2.803 | −0.752 | 0.439 | 2.803 | 1.143 | −0.526 | 2.803 |
| −0.680 | 0.198 | 2.803 | −0.701 | 0.397 | 2.803 | 1.143 | −0.527 | 2.803 |
| −0.734 | 0.247 | 2.803 | −0.648 | 0.354 | 2.803 | | | |
| −0.785 | 0.296 | 2.803 | −0.592 | 0.310 | 2.803 | | | |
| 1.103 | −0.630 | 3.127 | −0.846 | 0.376 | 3.127 | −0.542 | 0.271 | 3.127 |
| 1.103 | −0.631 | 3.127 | −0.884 | 0.431 | 3.127 | −0.485 | 0.219 | 3.127 |
| 1.102 | −0.633 | 3.127 | −0.920 | 0.484 | 3.127 | −0.424 | 0.167 | 3.127 |
| 1.099 | −0.637 | 3.127 | −0.951 | 0.534 | 3.127 | −0.362 | 0.116 | 3.127 |
| 1.092 | −0.639 | 3.127 | −0.978 | 0.580 | 3.127 | −0.299 | 0.066 | 3.127 |
| 1.080 | −0.638 | 3.127 | −1.002 | 0.622 | 3.127 | −0.235 | 0.018 | 3.127 |
| 1.063 | −0.636 | 3.127 | −1.022 | 0.659 | 3.127 | −0.169 | −0.028 | 3.127 |
| 1.041 | −0.633 | 3.127 | −1.038 | 0.691 | 3.127 | −0.102 | −0.073 | 3.127 |
| 1.013 | −0.629 | 3.127 | −1.052 | 0.719 | 3.127 | −0.035 | −0.117 | 3.127 |
| 0.977 | −0.624 | 3.127 | −1.063 | 0.743 | 3.127 | 0.033 | −0.159 | 3.127 |
| 0.935 | −0.617 | 3.127 | −1.071 | 0.763 | 3.127 | 0.102 | −0.200 | 3.127 |
| 0.891 | −0.610 | 3.127 | −1.078 | 0.780 | 3.127 | 0.172 | −0.240 | 3.127 |
| 0.842 | −0.601 | 3.127 | −1.083 | 0.794 | 3.127 | 0.242 | −0.278 | 3.127 |
| 0.787 | −0.590 | 3.127 | −1.085 | 0.805 | 3.127 | 0.313 | −0.315 | 3.127 |
| 0.726 | −0.578 | 3.127 | −1.087 | 0.814 | 3.127 | 0.382 | −0.350 | 3.127 |
| 0.664 | −0.564 | 3.127 | −1.087 | 0.821 | 3.127 | 0.449 | −0.382 | 3.127 |
| 0.598 | −0.548 | 3.127 | −1.086 | 0.826 | 3.127 | 0.515 | −0.412 | 3.127 |
| 0.530 | −0.530 | 3.127 | −1.083 | 0.829 | 3.127 | 0.578 | −0.440 | 3.127 |
| 0.460 | −0.511 | 3.127 | −1.079 | 0.830 | 3.127 | 0.640 | −0.466 | 3.127 |
| 0.388 | −0.489 | 3.127 | −1.074 | 0.829 | 3.127 | 0.700 | −0.489 | 3.127 |
| 0.314 | −0.465 | 3.127 | −1.068 | 0.826 | 3.127 | 0.757 | −0.511 | 3.127 |
| 0.237 | −0.438 | 3.127 | −1.061 | 0.821 | 3.127 | 0.813 | −0.531 | 3.127 |
| 0.159 | −0.408 | 3.127 | −1.053 | 0.815 | 3.127 | 0.864 | −0.548 | 3.127 |
| 0.082 | −0.376 | 3.127 | −1.043 | 0.805 | 3.127 | 0.910 | −0.563 | 3.127 |
| 0.006 | −0.341 | 3.127 | −1.031 | 0.793 | 3.127 | 0.951 | −0.576 | 3.127 |
| −0.068 | −0.305 | 3.127 | −1.016 | 0.777 | 3.127 | 0.990 | −0.587 | 3.127 |
| −0.141 | −0.265 | 3.127 | −0.999 | 0.758 | 3.127 | 1.023 | −0.597 | 3.127 |
| −0.213 | −0.222 | 3.127 | −0.980 | 0.736 | 3.127 | 1.049 | −0.604 | 3.127 |
| −0.283 | −0.177 | 3.127 | −0.957 | 0.710 | 3.127 | 1.070 | −0.610 | 3.127 |
| −0.351 | −0.128 | 3.127 | −0.930 | 0.680 | 3.127 | 1.085 | −0.614 | 3.127 |
| −0.418 | −0.077 | 3.127 | −0.900 | 0.645 | 3.127 | 1.097 | −0.617 | 3.127 |
| −0.482 | −0.023 | 3.127 | −0.867 | 0.607 | 3.127 | 1.102 | −0.622 | 3.127 |
| −0.544 | 0.033 | 3.127 | −0.829 | 0.565 | 3.127 | 1.103 | −0.626 | 3.127 |
| −0.604 | 0.091 | 3.127 | −0.788 | 0.519 | 3.127 | 1.103 | −0.628 | 3.127 |
| −0.659 | 0.149 | 3.127 | −0.744 | 0.472 | 3.127 | 1.103 | −0.629 | 3.127 |
| −0.711 | 0.206 | 3.127 | −0.697 | 0.424 | 3.127 | 1.103 | −0.630 | 3.127 |
| −0.759 | 0.264 | 3.127 | −0.649 | 0.374 | 3.127 | | | |
| −0.804 | 0.320 | 3.127 | −0.597 | 0.323 | 3.127 | | | |

TABLE 15S-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.063 | −0.737 | 3.450 | −0.874 | 0.584 | 3.450 | −0.586 | 0.412 | 3.450 |
| 1.063 | −0.739 | 3.450 | −0.903 | 0.651 | 3.450 | −0.536 | 0.346 | 3.450 |
| 1.062 | −0.741 | 3.450 | −0.930 | 0.715 | 3.450 | −0.482 | 0.279 | 3.450 |
| 1.058 | −0.744 | 3.450 | −0.953 | 0.775 | 3.450 | −0.426 | 0.213 | 3.450 |
| 1.051 | −0.746 | 3.450 | −0.972 | 0.829 | 3.450 | −0.369 | 0.149 | 3.450 |
| 1.037 | −0.744 | 3.450 | −0.989 | 0.878 | 3.450 | −0.309 | 0.087 | 3.450 |
| 1.019 | −0.742 | 3.450 | −1.003 | 0.921 | 3.450 | −0.248 | 0.027 | 3.450 |
| 0.995 | −0.739 | 3.450 | −1.014 | 0.959 | 3.450 | −0.184 | −0.032 | 3.450 |
| 0.964 | −0.735 | 3.450 | −1.023 | 0.992 | 3.450 | −0.118 | −0.088 | 3.450 |
| 0.925 | −0.729 | 3.450 | −1.031 | 1.019 | 3.450 | −0.050 | −0.143 | 3.450 |
| 0.880 | −0.721 | 3.450 | −1.037 | 1.043 | 3.450 | 0.019 | −0.196 | 3.450 |
| 0.832 | −0.712 | 3.450 | −1.040 | 1.062 | 3.450 | 0.088 | −0.247 | 3.450 |
| 0.778 | −0.701 | 3.450 | −1.043 | 1.078 | 3.450 | 0.159 | −0.297 | 3.450 |
| 0.719 | −0.688 | 3.450 | −1.044 | 1.090 | 3.450 | 0.231 | −0.345 | 3.450 |
| 0.654 | −0.672 | 3.450 | −1.044 | 1.099 | 3.450 | 0.301 | −0.390 | 3.450 |
| 0.586 | −0.654 | 3.450 | −1.043 | 1.107 | 3.450 | 0.370 | −0.432 | 3.450 |
| 0.516 | −0.633 | 3.450 | −1.042 | 1.113 | 3.450 | 0.438 | −0.471 | 3.450 |
| 0.443 | −0.610 | 3.450 | −1.039 | 1.116 | 3.450 | 0.504 | −0.506 | 3.450 |
| 0.368 | −0.584 | 3.450 | −1.035 | 1.115 | 3.450 | 0.568 | −0.539 | 3.450 |
| 0.291 | −0.554 | 3.450 | −1.030 | 1.112 | 3.450 | 0.631 | −0.569 | 3.450 |
| 0.213 | −0.521 | 3.450 | −1.025 | 1.107 | 3.450 | 0.692 | −0.597 | 3.450 |
| 0.134 | −0.484 | 3.450 | −1.019 | 1.101 | 3.450 | 0.751 | −0.621 | 3.450 |
| 0.053 | −0.443 | 3.450 | −1.012 | 1.092 | 3.450 | 0.805 | −0.643 | 3.450 |
| −0.026 | −0.399 | 3.450 | −1.003 | 1.079 | 3.450 | 0.854 | −0.661 | 3.450 |
| −0.103 | −0.351 | 3.450 | −0.993 | 1.063 | 3.450 | 0.898 | −0.676 | 3.450 |
| −0.178 | −0.300 | 3.450 | −0.981 | 1.044 | 3.450 | 0.940 | −0.689 | 3.450 |
| −0.251 | −0.244 | 3.450 | −0.968 | 1.020 | 3.450 | 0.976 | −0.701 | 3.450 |
| −0.321 | −0.186 | 3.450 | −0.952 | 0.992 | 3.450 | 1.004 | −0.709 | 3.450 |
| −0.388 | −0.124 | 3.450 | −0.934 | 0.960 | 3.450 | 1.026 | −0.716 | 3.450 |
| −0.451 | −0.059 | 3.450 | −0.912 | 0.922 | 3.450 | 1.043 | −0.720 | 3.450 |
| −0.511 | 0.009 | 3.450 | −0.888 | 0.879 | 3.450 | 1.056 | −0.724 | 3.450 |
| −0.568 | 0.079 | 3.450 | −0.861 | 0.832 | 3.450 | 1.061 | −0.728 | 3.450 |
| −0.623 | 0.152 | 3.450 | −0.830 | 0.779 | 3.450 | 1.063 | −0.733 | 3.450 |
| −0.674 | 0.227 | 3.450 | −0.795 | 0.722 | 3.450 | 1.063 | −0.735 | 3.450 |
| −0.722 | 0.301 | 3.450 | −0.759 | 0.663 | 3.450 | 1.063 | −0.736 | 3.450 |
| −0.766 | 0.374 | 3.450 | −0.720 | 0.602 | 3.450 | 1.063 | −0.737 | 3.450 |
| −0.805 | 0.446 | 3.450 | −0.678 | 0.540 | 3.450 | | | |
| −0.841 | 0.516 | 3.450 | −0.634 | 0.476 | 3.450 | | | |

The coordinate values given in TABLE 16S below provide the nominal profile envelope for an exemplary sixteenth stage stator.

TABLE 16S

| X-LOC | Y-LOC | Z-LOC | X-LOC | Y-LOC | Z-LOC | X-LOC | Y-LOC | Z-LOC |
|---|---|---|---|---|---|---|---|---|
| 2.049 | −0.214 | 0.000 | −1.104 | −0.113 | 0.000 | −0.813 | 0.110 | 0.000 |
| 2.048 | −0.220 | 0.000 | −1.198 | −0.071 | 0.000 | −0.705 | 0.088 | 0.000 |
| 2.046 | −0.228 | 0.000 | −1.287 | −0.029 | 0.000 | −0.593 | 0.067 | 0.000 |
| 2.042 | −0.237 | 0.000 | −1.371 | 0.013 | 0.000 | −0.477 | 0.047 | 0.000 |
| 2.035 | −0.246 | 0.000 | −1.451 | 0.056 | 0.000 | −0.360 | 0.028 | 0.000 |
| 2.021 | −0.255 | 0.000 | −1.522 | 0.097 | 0.000 | −0.243 | 0.011 | 0.000 |
| 2.000 | −0.259 | 0.000 | −1.586 | 0.136 | 0.000 | −0.126 | −0.004 | 0.000 |
| 1.974 | −0.261 | 0.000 | −1.641 | 0.171 | 0.000 | −0.009 | −0.018 | 0.000 |
| 1.942 | −0.264 | 0.000 | −1.691 | 0.207 | 0.000 | 0.108 | −0.031 | 0.000 |
| 1.904 | −0.268 | 0.000 | −1.734 | 0.240 | 0.000 | 0.226 | −0.042 | 0.000 |
| 1.859 | −0.272 | 0.000 | −1.764 | 0.267 | 0.000 | 0.344 | −0.053 | 0.000 |
| 1.806 | −0.277 | 0.000 | −1.787 | 0.291 | 0.000 | 0.461 | −0.063 | 0.000 |
| 1.746 | −0.282 | 0.000 | −1.803 | 0.310 | 0.000 | 0.579 | −0.073 | 0.000 |
| 1.677 | −0.288 | 0.000 | −1.812 | 0.326 | 0.000 | 0.697 | −0.083 | 0.000 |
| 1.600 | −0.295 | 0.000 | −1.815 | 0.336 | 0.000 | 0.815 | −0.093 | 0.000 |
| 1.514 | −0.302 | 0.000 | −1.815 | 0.343 | 0.000 | 0.929 | −0.102 | 0.000 |
| 1.421 | −0.310 | 0.000 | −1.814 | 0.346 | 0.000 | 1.039 | −0.110 | 0.000 |
| 1.324 | −0.318 | 0.000 | −1.813 | 0.347 | 0.000 | 1.145 | −0.119 | 0.000 |
| 1.222 | −0.327 | 0.000 | −1.813 | 0.348 | 0.000 | 1.247 | −0.126 | 0.000 |
| 1.117 | −0.335 | 0.000 | −1.812 | 0.349 | 0.000 | 1.345 | −0.134 | 0.000 |
| 1.007 | −0.343 | 0.000 | −1.812 | 0.350 | 0.000 | 1.439 | −0.140 | 0.000 |
| 0.894 | −0.351 | 0.000 | −1.809 | 0.353 | 0.000 | 1.530 | −0.146 | 0.000 |
| 0.776 | −0.359 | 0.000 | −1.804 | 0.356 | 0.000 | 1.612 | −0.151 | 0.000 |
| 0.654 | −0.365 | 0.000 | −1.795 | 0.359 | 0.000 | 1.687 | −0.155 | 0.000 |
| 0.532 | −0.371 | 0.000 | −1.777 | 0.361 | 0.000 | 1.754 | −0.159 | 0.000 |
| 0.411 | −0.374 | 0.000 | −1.753 | 0.360 | 0.000 | 1.813 | −0.162 | 0.000 |

TABLE 16S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.289 | −0.375 | 0.000 | −1.722 | 0.356 | 0.000 | 1.864 | −0.165 | 0.000 |
| 0.168 | −0.374 | 0.000 | −1.683 | 0.348 | 0.000 | 1.907 | −0.167 | 0.000 |
| 0.046 | −0.370 | 0.000 | −1.634 | 0.335 | 0.000 | 1.944 | −0.169 | 0.000 |
| −0.075 | −0.363 | 0.000 | −1.577 | 0.319 | 0.000 | 1.975 | −0.170 | 0.000 |
| −0.196 | −0.351 | 0.000 | −1.517 | 0.301 | 0.000 | 2.001 | −0.171 | 0.000 |
| −0.316 | −0.336 | 0.000 | −1.449 | 0.280 | 0.000 | 2.021 | −0.175 | 0.000 |
| −0.437 | −0.316 | 0.000 | −1.374 | 0.257 | 0.000 | 2.034 | −0.183 | 0.000 |
| −0.557 | −0.291 | 0.000 | −1.290 | 0.232 | 0.000 | 2.042 | −0.192 | 0.000 |
| −0.677 | −0.261 | 0.000 | −1.203 | 0.207 | 0.000 | 2.046 | −0.200 | 0.000 |
| −0.791 | −0.228 | 0.000 | −1.112 | 0.182 | 0.000 | 2.048 | −0.208 | 0.000 |
| −0.900 | −0.192 | 0.000 | −1.017 | 0.158 | 0.000 | | | |
| −1.005 | −0.153 | 0.000 | −0.917 | 0.134 | 0.000 | | | |
| 2.017 | −0.210 | 0.663 | −1.070 | −0.129 | 0.663 | −0.809 | 0.105 | 0.663 |
| 2.017 | −0.216 | 0.663 | −1.165 | −0.098 | 0.663 | −0.701 | 0.090 | 0.663 |
| 2.015 | −0.223 | 0.663 | −1.257 | −0.066 | 0.663 | −0.589 | 0.074 | 0.663 |
| 2.010 | −0.232 | 0.663 | −1.344 | −0.033 | 0.663 | −0.474 | 0.059 | 0.663 |
| 2.003 | −0.241 | 0.663 | −1.426 | 0.001 | 0.663 | −0.358 | 0.044 | 0.663 |
| 1.989 | −0.249 | 0.663 | −1.500 | 0.033 | 0.663 | −0.242 | 0.031 | 0.663 |
| 1.969 | −0.252 | 0.663 | −1.566 | 0.064 | 0.663 | −0.126 | 0.018 | 0.663 |
| 1.943 | −0.253 | 0.663 | −1.624 | 0.093 | 0.663 | −0.010 | 0.006 | 0.663 |
| 1.912 | −0.254 | 0.663 | −1.677 | 0.122 | 0.663 | 0.106 | −0.005 | 0.663 |
| 1.874 | −0.256 | 0.663 | −1.722 | 0.149 | 0.663 | 0.222 | −0.017 | 0.663 |
| 1.831 | −0.258 | 0.663 | −1.756 | 0.173 | 0.663 | 0.338 | −0.028 | 0.663 |
| 1.779 | −0.260 | 0.663 | −1.781 | 0.193 | 0.663 | 0.454 | −0.038 | 0.663 |
| 1.720 | −0.263 | 0.663 | −1.798 | 0.210 | 0.663 | 0.570 | −0.049 | 0.663 |
| 1.652 | −0.266 | 0.663 | −1.809 | 0.225 | 0.663 | 0.686 | −0.060 | 0.663 |
| 1.577 | −0.269 | 0.663 | −1.812 | 0.234 | 0.663 | 0.802 | −0.070 | 0.663 |
| 1.493 | −0.273 | 0.663 | −1.813 | 0.241 | 0.663 | 0.915 | −0.081 | 0.663 |
| 1.402 | −0.276 | 0.663 | −1.813 | 0.244 | 0.663 | 1.023 | −0.091 | 0.663 |
| 1.307 | −0.280 | 0.663 | −1.812 | 0.246 | 0.663 | 1.128 | −0.100 | 0.663 |
| 1.208 | −0.283 | 0.663 | −1.812 | 0.246 | 0.663 | 1.228 | −0.109 | 0.663 |
| 1.105 | −0.287 | 0.663 | −1.812 | 0.247 | 0.663 | 1.325 | −0.117 | 0.663 |
| 0.997 | −0.291 | 0.663 | −1.811 | 0.249 | 0.663 | 1.418 | −0.125 | 0.663 |
| 0.886 | −0.294 | 0.663 | −1.809 | 0.251 | 0.663 | 1.507 | −0.132 | 0.663 |
| 0.771 | −0.298 | 0.663 | −1.804 | 0.255 | 0.663 | 1.588 | −0.139 | 0.663 |
| 0.652 | −0.300 | 0.663 | −1.795 | 0.259 | 0.663 | 1.662 | −0.144 | 0.663 |
| 0.533 | −0.302 | 0.663 | −1.778 | 0.263 | 0.663 | 1.728 | −0.149 | 0.663 |
| 0.414 | −0.304 | 0.663 | −1.755 | 0.264 | 0.663 | 1.786 | −0.154 | 0.663 |
| 0.296 | −0.304 | 0.663 | −1.724 | 0.263 | 0.663 | 1.837 | −0.157 | 0.663 |
| 0.177 | −0.302 | 0.663 | −1.685 | 0.259 | 0.663 | 1.879 | −0.160 | 0.663 |
| 0.059 | −0.300 | 0.663 | −1.635 | 0.251 | 0.663 | 1.916 | −0.163 | 0.663 |
| −0.059 | −0.295 | 0.663 | −1.578 | 0.241 | 0.663 | 1.946 | −0.165 | 0.663 |
| −0.177 | −0.287 | 0.663 | −1.517 | 0.229 | 0.663 | 1.971 | −0.167 | 0.663 |
| −0.295 | −0.278 | 0.663 | −1.448 | 0.216 | 0.663 | 1.991 | −0.170 | 0.663 |
| −0.412 | −0.266 | 0.663 | −1.372 | 0.201 | 0.663 | 2.004 | −0.179 | 0.663 |
| −0.529 | −0.250 | 0.663 | −1.288 | 0.185 | 0.663 | 2.011 | −0.188 | 0.663 |
| −0.646 | −0.231 | 0.663 | −1.200 | 0.169 | 0.663 | 2.015 | −0.196 | 0.663 |
| −0.758 | −0.209 | 0.663 | −1.108 | 0.153 | 0.663 | 2.017 | −0.204 | 0.663 |
| −0.866 | −0.184 | 0.663 | −1.012 | 0.136 | 0.663 | | | |
| −0.970 | −0.157 | 0.663 | −0.912 | 0.121 | 0.663 | | | |
| 2.003 | −0.263 | 1.327 | −1.062 | −0.099 | 1.327 | −0.799 | 0.103 | 1.327 |
| 2.002 | −0.269 | 1.327 | −1.156 | −0.070 | 1.327 | −0.692 | 0.087 | 1.327 |
| 2.000 | −0.276 | 1.327 | −1.245 | −0.040 | 1.327 | −0.581 | 0.071 | 1.327 |
| 1.995 | −0.285 | 1.327 | −1.331 | −0.010 | 1.327 | −0.466 | 0.055 | 1.327 |
| 1.987 | −0.293 | 1.327 | −1.412 | 0.021 | 1.327 | −0.351 | 0.039 | 1.327 |
| 1.973 | −0.299 | 1.327 | −1.484 | 0.051 | 1.327 | −0.237 | 0.024 | 1.327 |
| 1.952 | −0.301 | 1.327 | −1.549 | 0.079 | 1.327 | −0.122 | 0.009 | 1.327 |
| 1.927 | −0.301 | 1.327 | −1.607 | 0.105 | 1.327 | −0.007 | −0.004 | 1.327 |
| 1.896 | −0.301 | 1.327 | −1.659 | 0.132 | 1.327 | 0.108 | −0.018 | 1.327 |
| 1.859 | −0.301 | 1.327 | −1.704 | 0.157 | 1.327 | 0.224 | −0.031 | 1.327 |
| 1.816 | −0.301 | 1.327 | −1.737 | 0.179 | 1.327 | 0.339 | −0.044 | 1.327 |
| 1.765 | −0.301 | 1.327 | −1.762 | 0.198 | 1.327 | 0.454 | −0.057 | 1.327 |
| 1.706 | −0.302 | 1.327 | −1.779 | 0.214 | 1.327 | 0.569 | −0.070 | 1.327 |
| 1.639 | −0.302 | 1.327 | −1.790 | 0.228 | 1.327 | 0.684 | −0.083 | 1.327 |
| 1.565 | −0.302 | 1.327 | −1.794 | 0.236 | 1.327 | 0.799 | −0.097 | 1.327 |
| 1.482 | −0.302 | 1.327 | −1.796 | 0.243 | 1.327 | 0.910 | −0.110 | 1.327 |
| 1.392 | −0.302 | 1.327 | −1.795 | 0.246 | 1.327 | 1.018 | −0.122 | 1.327 |
| 1.298 | −0.301 | 1.327 | −1.795 | 0.247 | 1.327 | 1.121 | −0.134 | 1.327 |
| 1.200 | −0.301 | 1.327 | −1.795 | 0.248 | 1.327 | 1.221 | −0.145 | 1.327 |
| 1.097 | −0.301 | 1.327 | −1.794 | 0.249 | 1.327 | 1.317 | −0.155 | 1.327 |
| 0.991 | −0.300 | 1.327 | −1.794 | 0.250 | 1.327 | 1.409 | −0.165 | 1.327 |
| 0.882 | −0.300 | 1.327 | −1.792 | 0.253 | 1.327 | 1.497 | −0.175 | 1.327 |
| 0.768 | −0.298 | 1.327 | −1.787 | 0.257 | 1.327 | 1.578 | −0.183 | 1.327 |
| 0.650 | −0.297 | 1.327 | −1.778 | 0.261 | 1.327 | 1.651 | −0.190 | 1.327 |
| 0.532 | −0.295 | 1.327 | −1.761 | 0.264 | 1.327 | 1.716 | −0.197 | 1.327 |
| 0.415 | −0.292 | 1.327 | −1.738 | 0.265 | 1.327 | 1.774 | −0.203 | 1.327 |
| 0.297 | −0.288 | 1.327 | −1.707 | 0.264 | 1.327 | 1.824 | −0.208 | 1.327 |

TABLE 16S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.179 | −0.284 | 1.327 | −1.668 | 0.260 | 1.327 | 1.866 | −0.212 | 1.327 |
| 0.062 | −0.278 | 1.327 | −1.619 | 0.252 | 1.327 | 1.902 | −0.216 | 1.327 |
| −0.056 | −0.270 | 1.327 | −1.562 | 0.241 | 1.327 | 1.933 | −0.219 | 1.327 |
| −0.174 | −0.260 | 1.327 | −1.501 | 0.229 | 1.327 | 1.958 | −0.221 | 1.327 |
| −0.291 | −0.249 | 1.327 | −1.433 | 0.215 | 1.327 | 1.977 | −0.224 | 1.327 |
| −0.408 | −0.235 | 1.327 | −1.358 | 0.200 | 1.327 | 1.990 | −0.232 | 1.327 |
| −0.525 | −0.218 | 1.327 | −1.274 | 0.184 | 1.327 | 1.998 | −0.241 | 1.327 |
| −0.641 | −0.199 | 1.327 | −1.187 | 0.168 | 1.327 | 2.002 | −0.250 | 1.327 |
| −0.753 | −0.177 | 1.327 | −1.096 | 0.152 | 1.327 | 2.003 | −0.257 | 1.327 |
| −0.860 | −0.153 | 1.327 | −1.001 | 0.135 | 1.327 | | | |
| −0.963 | −0.127 | 1.327 | −0.902 | 0.119 | 1.327 | | | |
| 2.023 | −0.358 | 1.990 | −1.008 | −0.069 | 1.990 | −0.758 | 0.098 | 1.990 |
| 2.022 | −0.364 | 1.990 | −1.101 | −0.037 | 1.990 | −0.652 | 0.077 | 1.990 |
| 2.019 | −0.371 | 1.990 | −1.190 | −0.005 | 1.990 | −0.543 | 0.057 | 1.990 |
| 2.013 | −0.378 | 1.990 | −1.275 | 0.028 | 1.990 | −0.429 | 0.036 | 1.990 |
| 2.002 | −0.384 | 1.990 | −1.356 | 0.061 | 1.990 | −0.316 | 0.016 | 1.990 |
| 1.987 | −0.385 | 1.990 | −1.429 | 0.092 | 1.990 | −0.202 | −0.004 | 1.990 |
| 1.967 | −0.384 | 1.990 | −1.494 | 0.122 | 1.990 | −0.088 | −0.023 | 1.990 |
| 1.941 | −0.383 | 1.990 | −1.551 | 0.150 | 1.990 | 0.025 | −0.041 | 1.990 |
| 1.910 | −0.383 | 1.990 | −1.603 | 0.177 | 1.990 | 0.139 | −0.059 | 1.990 |
| 1.874 | −0.382 | 1.990 | −1.648 | 0.203 | 1.990 | 0.253 | −0.077 | 1.990 |
| 1.831 | −0.380 | 1.990 | −1.681 | 0.224 | 1.990 | 0.367 | −0.094 | 1.990 |
| 1.780 | −0.379 | 1.990 | −1.707 | 0.243 | 1.990 | 0.481 | −0.111 | 1.990 |
| 1.722 | −0.377 | 1.990 | −1.725 | 0.259 | 1.990 | 0.595 | −0.128 | 1.990 |
| 1.656 | −0.375 | 1.990 | −1.737 | 0.272 | 1.990 | 0.709 | −0.145 | 1.990 |
| 1.582 | −0.372 | 1.990 | −1.742 | 0.281 | 1.990 | 0.824 | −0.162 | 1.990 |
| 1.500 | −0.370 | 1.990 | −1.743 | 0.287 | 1.990 | 0.934 | −0.178 | 1.990 |
| 1.410 | −0.366 | 1.990 | −1.743 | 0.290 | 1.990 | 1.040 | −0.193 | 1.990 |
| 1.317 | −0.363 | 1.990 | −1.743 | 0.291 | 1.990 | 1.143 | −0.208 | 1.990 |
| 1.220 | −0.359 | 1.990 | −1.743 | 0.292 | 1.990 | 1.242 | −0.223 | 1.990 |
| 1.118 | −0.356 | 1.990 | −1.742 | 0.293 | 1.990 | 1.337 | −0.236 | 1.990 |
| 1.013 | −0.352 | 1.990 | −1.742 | 0.294 | 1.990 | 1.428 | −0.249 | 1.990 |
| 0.904 | −0.347 | 1.990 | −1.739 | 0.296 | 1.990 | 1.516 | −0.262 | 1.990 |
| 0.791 | −0.342 | 1.990 | −1.734 | 0.300 | 1.990 | 1.596 | −0.273 | 1.990 |
| 0.675 | −0.337 | 1.990 | −1.725 | 0.302 | 1.990 | 1.668 | −0.282 | 1.990 |
| 0.558 | −0.330 | 1.990 | −1.708 | 0.304 | 1.990 | 1.733 | −0.291 | 1.990 |
| 0.442 | −0.323 | 1.990 | −1.684 | 0.303 | 1.990 | 1.790 | −0.299 | 1.990 |
| 0.326 | −0.314 | 1.990 | −1.654 | 0.300 | 1.990 | 1.840 | −0.306 | 1.990 |
| 0.210 | −0.305 | 1.990 | −1.616 | 0.293 | 1.990 | 1.882 | −0.311 | 1.990 |
| 0.094 | −0.293 | 1.990 | −1.567 | 0.283 | 1.990 | 1.917 | −0.316 | 1.990 |
| −0.022 | −0.280 | 1.990 | −1.511 | 0.269 | 1.990 | 1.948 | −0.320 | 1.990 |
| −0.137 | −0.266 | 1.990 | −1.451 | 0.255 | 1.990 | 1.972 | −0.323 | 1.990 |
| −0.252 | −0.249 | 1.990 | −1.384 | 0.238 | 1.990 | 1.992 | −0.326 | 1.990 |
| −0.366 | −0.230 | 1.990 | −1.310 | 0.219 | 1.990 | 2.007 | −0.329 | 1.990 |
| −0.481 | −0.208 | 1.990 | −1.227 | 0.199 | 1.990 | 2.016 | −0.337 | 1.990 |
| −0.594 | −0.184 | 1.990 | −1.141 | 0.179 | 1.990 | 2.021 | −0.345 | 1.990 |
| −0.704 | −0.157 | 1.990 | −1.051 | 0.159 | 1.990 | 2.023 | −0.352 | 1.990 |
| −0.810 | −0.129 | 1.990 | −0.957 | 0.139 | 1.990 | | | |
| −0.911 | −0.100 | 1.990 | −0.860 | 0.118 | 1.990 | | | |
| 2.036 | −0.416 | 2.322 | −0.990 | −0.051 | 2.322 | −0.734 | 0.096 | 2.322 |
| 2.035 | −0.422 | 2.322 | −1.082 | −0.018 | 2.322 | −0.629 | 0.073 | 2.322 |
| 2.031 | −0.429 | 2.322 | −1.170 | 0.016 | 2.322 | −0.520 | 0.050 | 2.322 |
| 2.024 | −0.435 | 2.322 | −1.253 | 0.049 | 2.322 | −0.408 | 0.027 | 2.322 |
| 2.013 | −0.438 | 2.322 | −1.332 | 0.083 | 2.322 | −0.295 | 0.004 | 2.322 |
| 1.997 | −0.437 | 2.322 | −1.404 | 0.114 | 2.322 | −0.182 | −0.018 | 2.322 |
| 1.977 | −0.436 | 2.322 | −1.468 | 0.144 | 2.322 | −0.069 | −0.040 | 2.322 |
| 1.952 | −0.435 | 2.322 | −1.524 | 0.171 | 2.322 | 0.045 | −0.061 | 2.322 |
| 1.921 | −0.434 | 2.322 | −1.576 | 0.199 | 2.322 | 0.158 | −0.082 | 2.322 |
| 1.885 | −0.432 | 2.322 | −1.620 | 0.224 | 2.322 | 0.271 | −0.102 | 2.322 |
| 1.842 | −0.430 | 2.322 | −1.653 | 0.245 | 2.322 | 0.385 | −0.122 | 2.322 |
| 1.791 | −0.428 | 2.322 | −1.678 | 0.263 | 2.322 | 0.498 | −0.142 | 2.322 |
| 1.733 | −0.425 | 2.322 | −1.696 | 0.279 | 2.322 | 0.612 | −0.161 | 2.322 |
| 1.667 | −0.422 | 2.322 | −1.708 | 0.292 | 2.322 | 0.725 | −0.181 | 2.322 |
| 1.593 | −0.418 | 2.322 | −1.713 | 0.300 | 2.322 | 0.839 | −0.200 | 2.322 |
| 1.512 | −0.413 | 2.322 | −1.715 | 0.306 | 2.322 | 0.949 | −0.219 | 2.322 |
| 1.423 | −0.408 | 2.322 | −1.715 | 0.309 | 2.322 | 1.055 | −0.236 | 2.322 |
| 1.329 | −0.403 | 2.322 | −1.715 | 0.310 | 2.322 | 1.157 | −0.254 | 2.322 |
| 1.232 | −0.398 | 2.322 | −1.714 | 0.311 | 2.322 | 1.255 | −0.270 | 2.322 |
| 1.131 | −0.392 | 2.322 | −1.714 | 0.312 | 2.322 | 1.350 | −0.286 | 2.322 |
| 1.027 | −0.386 | 2.322 | −1.713 | 0.313 | 2.322 | 1.441 | −0.301 | 2.322 |
| 0.918 | −0.379 | 2.322 | −1.711 | 0.315 | 2.322 | 1.528 | −0.315 | 2.322 |
| 0.806 | −0.372 | 2.322 | −1.706 | 0.318 | 2.322 | 1.608 | −0.327 | 2.322 |
| 0.689 | −0.363 | 2.322 | −1.696 | 0.321 | 2.322 | 1.680 | −0.338 | 2.322 |
| 0.573 | −0.354 | 2.322 | −1.679 | 0.321 | 2.322 | 1.745 | −0.348 | 2.322 |
| 0.457 | −0.344 | 2.322 | −1.656 | 0.320 | 2.322 | 1.801 | −0.357 | 2.322 |
| 0.341 | −0.332 | 2.322 | −1.625 | 0.315 | 2.322 | 1.851 | −0.365 | 2.322 |
| 0.226 | −0.319 | 2.322 | −1.588 | 0.308 | 2.322 | 1.893 | −0.371 | 2.322 |

TABLE 16S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.110 | −0.305 | 2.322 | −1.539 | 0.297 | 2.322 | 1.928 | −0.377 | 2.322 |
| −0.005 | −0.289 | 2.322 | −1.483 | 0.282 | 2.322 | 1.958 | −0.381 | 2.322 |
| −0.121 | −0.271 | 2.322 | −1.424 | 0.267 | 2.322 | 1.983 | −0.385 | 2.322 |
| −0.235 | −0.250 | 2.322 | −1.357 | 0.249 | 2.322 | 2.003 | −0.388 | 2.322 |
| −0.350 | −0.228 | 2.322 | −1.283 | 0.229 | 2.322 | 2.018 | −0.390 | 2.322 |
| −0.464 | −0.203 | 2.322 | −1.201 | 0.207 | 2.322 | 2.028 | −0.395 | 2.322 |
| −0.578 | −0.175 | 2.322 | −1.116 | 0.186 | 2.322 | 2.034 | −0.403 | 2.322 |
| −0.688 | −0.146 | 2.322 | −1.026 | 0.164 | 2.322 | 2.036 | −0.410 | 2.322 |
| −0.793 | −0.115 | 2.322 | −0.933 | 0.141 | 2.322 | | | |
| −0.894 | −0.083 | 2.322 | −0.836 | 0.119 | 2.322 | | | |
| 2.039 | −0.477 | 2.986 | −0.962 | −0.042 | 2.986 | −0.712 | 0.078 | 2.986 |
| 2.037 | −0.482 | 2.986 | −1.052 | −0.008 | 2.986 | −0.608 | 0.053 | 2.986 |
| 2.033 | −0.489 | 2.986 | −1.139 | 0.026 | 2.986 | −0.500 | 0.028 | 2.986 |
| 2.025 | −0.494 | 2.986 | −1.222 | 0.060 | 2.986 | −0.389 | 0.003 | 2.986 |
| 2.014 | −0.495 | 2.986 | −1.300 | 0.093 | 2.986 | −0.277 | −0.022 | 2.986 |
| 1.999 | −0.495 | 2.986 | −1.371 | 0.125 | 2.986 | −0.165 | −0.046 | 2.986 |
| 1.979 | −0.494 | 2.986 | −1.435 | 0.154 | 2.986 | −0.052 | −0.071 | 2.986 |
| 1.953 | −0.492 | 2.986 | −1.491 | 0.181 | 2.986 | 0.060 | −0.094 | 2.986 |
| 1.923 | −0.491 | 2.986 | −1.543 | 0.208 | 2.986 | 0.172 | −0.118 | 2.986 |
| 1.887 | −0.489 | 2.986 | −1.587 | 0.232 | 2.986 | 0.284 | −0.141 | 2.986 |
| 1.844 | −0.486 | 2.986 | −1.620 | 0.252 | 2.986 | 0.397 | −0.164 | 2.986 |
| 1.794 | −0.483 | 2.986 | −1.646 | 0.270 | 2.986 | 0.509 | −0.186 | 2.986 |
| 1.736 | −0.480 | 2.986 | −1.664 | 0.284 | 2.986 | 0.622 | −0.208 | 2.986 |
| 1.670 | −0.476 | 2.986 | −1.676 | 0.297 | 2.986 | 0.734 | −0.230 | 2.986 |
| 1.597 | −0.471 | 2.986 | −1.681 | 0.305 | 2.986 | 0.847 | −0.251 | 2.986 |
| 1.516 | −0.466 | 2.986 | −1.683 | 0.311 | 2.986 | 0.956 | −0.272 | 2.986 |
| 1.427 | −0.460 | 2.986 | −1.684 | 0.314 | 2.986 | 1.061 | −0.292 | 2.986 |
| 1.335 | −0.453 | 2.986 | −1.683 | 0.315 | 2.986 | 1.162 | −0.310 | 2.986 |
| 1.238 | −0.446 | 2.986 | −1.683 | 0.316 | 2.986 | 1.260 | −0.328 | 2.986 |
| 1.138 | −0.439 | 2.986 | −1.683 | 0.317 | 2.986 | 1.354 | −0.345 | 2.986 |
| 1.034 | −0.430 | 2.986 | −1.682 | 0.318 | 2.986 | 1.445 | −0.361 | 2.986 |
| 0.926 | −0.421 | 2.986 | −1.679 | 0.320 | 2.986 | 1.531 | −0.375 | 2.986 |
| 0.815 | −0.411 | 2.986 | −1.674 | 0.323 | 2.986 | 1.610 | −0.389 | 2.986 |
| 0.699 | −0.399 | 2.986 | −1.664 | 0.324 | 2.986 | 1.682 | −0.400 | 2.986 |
| 0.584 | −0.386 | 2.986 | −1.647 | 0.325 | 2.986 | 1.746 | −0.411 | 2.986 |
| 0.469 | −0.372 | 2.986 | −1.624 | 0.322 | 2.986 | 1.803 | −0.420 | 2.986 |
| 0.354 | −0.357 | 2.986 | −1.594 | 0.317 | 2.986 | 1.852 | −0.428 | 2.986 |
| 0.240 | −0.340 | 2.986 | −1.557 | 0.308 | 2.986 | 1.894 | −0.434 | 2.986 |
| 0.125 | −0.322 | 2.986 | −1.509 | 0.295 | 2.986 | 1.929 | −0.440 | 2.986 |
| 0.011 | −0.302 | 2.986 | −1.454 | 0.280 | 2.986 | 1.959 | −0.444 | 2.986 |
| −0.103 | −0.280 | 2.986 | −1.395 | 0.262 | 2.986 | 1.983 | −0.448 | 2.986 |
| −0.216 | −0.256 | 2.986 | −1.329 | 0.243 | 2.986 | 2.003 | −0.451 | 2.986 |
| −0.330 | −0.231 | 2.986 | −1.256 | 0.222 | 2.986 | 2.018 | −0.453 | 2.986 |
| −0.443 | −0.203 | 2.986 | −1.175 | 0.199 | 2.986 | 2.029 | −0.457 | 2.986 |
| −0.555 | −0.172 | 2.986 | −1.090 | 0.176 | 2.986 | 2.036 | −0.464 | 2.986 |
| −0.663 | −0.141 | 2.986 | −1.001 | 0.152 | 2.986 | 2.038 | −0.471 | 2.986 |
| −0.767 | −0.108 | 2.986 | −0.909 | 0.128 | 2.986 | | | |
| −0.866 | −0.075 | 2.986 | −0.813 | 0.103 | 2.986 | | | |
| 2.021 | −0.457 | 3.649 | −0.936 | −0.064 | 3.649 | −0.697 | 0.035 | 3.649 |
| 2.020 | −0.462 | 3.649 | −1.026 | −0.031 | 3.649 | −0.595 | 0.011 | 3.649 |
| 2.016 | −0.469 | 3.649 | −1.111 | 0.001 | 3.649 | −0.488 | −0.014 | 3.649 |
| 2.008 | −0.474 | 3.649 | −1.193 | 0.034 | 3.649 | −0.378 | −0.039 | 3.649 |
| 1.997 | −0.475 | 3.649 | −1.270 | 0.066 | 3.649 | −0.268 | −0.063 | 3.649 |
| 1.982 | −0.474 | 3.649 | −1.340 | 0.096 | 3.649 | −0.158 | −0.086 | 3.649 |
| 1.962 | −0.474 | 3.649 | −1.403 | 0.124 | 3.649 | −0.047 | −0.108 | 3.649 |
| 1.937 | −0.473 | 3.649 | −1.458 | 0.150 | 3.649 | 0.064 | −0.130 | 3.649 |
| 1.907 | −0.472 | 3.649 | −1.510 | 0.175 | 3.649 | 0.175 | −0.150 | 3.649 |
| 1.871 | −0.471 | 3.649 | −1.554 | 0.197 | 3.649 | 0.286 | −0.171 | 3.649 |
| 1.829 | −0.469 | 3.649 | −1.587 | 0.216 | 3.649 | 0.397 | −0.190 | 3.649 |
| 1.780 | −0.467 | 3.649 | −1.613 | 0.233 | 3.649 | 0.508 | −0.210 | 3.649 |
| 1.723 | −0.465 | 3.649 | −1.631 | 0.247 | 3.649 | 0.619 | −0.229 | 3.649 |
| 1.658 | −0.463 | 3.649 | −1.644 | 0.258 | 3.649 | 0.731 | −0.247 | 3.649 |
| 1.586 | −0.459 | 3.649 | −1.649 | 0.266 | 3.649 | 0.842 | −0.266 | 3.649 |
| 1.506 | −0.456 | 3.649 | −1.652 | 0.272 | 3.649 | 0.950 | −0.283 | 3.649 |
| 1.418 | −0.451 | 3.649 | −1.652 | 0.275 | 3.649 | 1.054 | −0.300 | 3.649 |
| 1.327 | −0.447 | 3.649 | −1.652 | 0.276 | 3.649 | 1.154 | −0.316 | 3.649 |
| 1.232 | −0.442 | 3.649 | −1.651 | 0.277 | 3.649 | 1.251 | −0.331 | 3.649 |
| 1.133 | −0.436 | 3.649 | −1.651 | 0.278 | 3.649 | 1.344 | −0.345 | 3.649 |
| 1.031 | −0.430 | 3.649 | −1.650 | 0.279 | 3.649 | 1.433 | −0.358 | 3.649 |
| 0.924 | −0.423 | 3.649 | −1.648 | 0.281 | 3.649 | 1.519 | −0.370 | 3.649 |
| 0.814 | −0.414 | 3.649 | −1.642 | 0.283 | 3.649 | 1.597 | −0.381 | 3.649 |
| 0.701 | −0.405 | 3.649 | −1.633 | 0.285 | 3.649 | 1.668 | −0.391 | 3.649 |
| 0.587 | −0.394 | 3.649 | −1.616 | 0.284 | 3.649 | 1.732 | −0.400 | 3.649 |
| 0.474 | −0.382 | 3.649 | −1.593 | 0.282 | 3.649 | 1.788 | −0.407 | 3.649 |
| 0.360 | −0.369 | 3.649 | −1.564 | 0.276 | 3.649 | 1.836 | −0.414 | 3.649 |
| 0.247 | −0.354 | 3.649 | −1.527 | 0.267 | 3.649 | 1.877 | −0.419 | 3.649 |
| 0.134 | −0.337 | 3.649 | −1.480 | 0.253 | 3.649 | 1.912 | −0.424 | 3.649 |

TABLE 16S-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.021 | −0.318 | 3.649 | −1.426 | 0.237 | 3.649 | 1.942 | −0.427 | 3.649 |
| −0.091 | −0.297 | 3.649 | −1.368 | 0.220 | 3.649 | 1.966 | −0.430 | 3.649 |
| −0.203 | −0.275 | 3.649 | −1.303 | 0.201 | 3.649 | 1.985 | −0.433 | 3.649 |
| −0.315 | −0.249 | 3.649 | −1.231 | 0.179 | 3.649 | 2.000 | −0.435 | 3.649 |
| −0.426 | −0.222 | 3.649 | −1.152 | 0.156 | 3.649 | 2.011 | −0.437 | 3.649 |
| −0.536 | −0.192 | 3.649 | −1.068 | 0.133 | 3.649 | 2.018 | −0.444 | 3.649 |
| −0.643 | −0.161 | 3.649 | −0.981 | 0.109 | 3.649 | 2.021 | −0.451 | 3.649 |
| −0.745 | −0.129 | 3.649 | −0.890 | 0.085 | 3.649 | | | |
| −0.842 | −0.097 | 3.649 | −0.795 | 0.060 | 3.649 | | | |
| 2.012 | −0.445 | 3.981 | −0.929 | −0.076 | 3.981 | −0.694 | 0.018 | 3.981 |
| 2.011 | −0.450 | 3.981 | −1.018 | −0.044 | 3.981 | −0.592 | −0.006 | 3.981 |
| 2.007 | −0.457 | 3.981 | −1.103 | −0.013 | 3.981 | −0.486 | −0.030 | 3.981 |
| 1.999 | −0.462 | 3.981 | −1.184 | 0.019 | 3.981 | −0.377 | −0.053 | 3.981 |
| 1.987 | −0.463 | 3.981 | −1.262 | 0.050 | 3.981 | −0.267 | −0.076 | 3.981 |
| 1.972 | −0.462 | 3.981 | −1.332 | 0.080 | 3.981 | −0.157 | −0.098 | 3.981 |
| 1.953 | −0.462 | 3.981 | −1.394 | 0.107 | 3.981 | −0.047 | −0.119 | 3.981 |
| 1.928 | −0.461 | 3.981 | −1.450 | 0.132 | 3.981 | 0.063 | −0.139 | 3.981 |
| 1.898 | −0.460 | 3.981 | −1.501 | 0.156 | 3.981 | 0.174 | −0.159 | 3.981 |
| 1.863 | −0.459 | 3.981 | −1.545 | 0.177 | 3.981 | 0.284 | −0.178 | 3.981 |
| 1.821 | −0.458 | 3.981 | −1.579 | 0.195 | 3.981 | 0.395 | −0.197 | 3.981 |
| 1.772 | −0.457 | 3.981 | −1.604 | 0.211 | 3.981 | 0.506 | −0.215 | 3.981 |
| 1.715 | −0.455 | 3.981 | −1.623 | 0.225 | 3.981 | 0.616 | −0.233 | 3.981 |
| 1.651 | −0.453 | 3.981 | −1.635 | 0.236 | 3.981 | 0.727 | −0.250 | 3.981 |
| 1.579 | −0.451 | 3.981 | −1.641 | 0.244 | 3.981 | 0.838 | −0.267 | 3.981 |
| 1.500 | −0.448 | 3.981 | −1.644 | 0.249 | 3.981 | 0.945 | −0.283 | 3.981 |
| 1.413 | −0.444 | 3.981 | −1.644 | 0.252 | 3.981 | 1.049 | −0.299 | 3.981 |
| 1.322 | −0.440 | 3.981 | −1.644 | 0.254 | 3.981 | 1.149 | −0.313 | 3.981 |
| 1.228 | −0.436 | 3.981 | −1.644 | 0.254 | 3.981 | 1.245 | −0.327 | 3.981 |
| 1.129 | −0.431 | 3.981 | −1.643 | 0.255 | 3.981 | 1.338 | −0.340 | 3.981 |
| 1.028 | −0.426 | 3.981 | −1.642 | 0.256 | 3.981 | 1.427 | −0.353 | 3.981 |
| 0.922 | −0.420 | 3.981 | −1.640 | 0.258 | 3.981 | 1.512 | −0.364 | 3.981 |
| 0.813 | −0.412 | 3.981 | −1.634 | 0.261 | 3.981 | 1.590 | −0.374 | 3.981 |
| 0.699 | −0.404 | 3.981 | −1.625 | 0.262 | 3.981 | 1.660 | −0.383 | 3.981 |
| 0.587 | −0.394 | 3.981 | −1.608 | 0.262 | 3.981 | 1.723 | −0.391 | 3.981 |
| 0.474 | −0.383 | 3.981 | −1.586 | 0.259 | 3.981 | 1.779 | −0.398 | 3.981 |
| 0.361 | −0.370 | 3.981 | −1.557 | 0.253 | 3.981 | 1.827 | −0.404 | 3.981 |
| 0.248 | −0.355 | 3.981 | −1.520 | 0.244 | 3.981 | 1.868 | −0.409 | 3.981 |
| 0.136 | −0.339 | 3.981 | −1.474 | 0.231 | 3.981 | 1.903 | −0.413 | 3.981 |
| 0.024 | −0.321 | 3.981 | −1.420 | 0.215 | 3.981 | 1.933 | −0.417 | 3.981 |
| −0.088 | −0.301 | 3.981 | −1.362 | 0.198 | 3.981 | 1.957 | −0.419 | 3.981 |
| −0.200 | −0.279 | 3.981 | −1.298 | 0.179 | 3.981 | 1.976 | −0.422 | 3.981 |
| −0.310 | −0.255 | 3.981 | −1.226 | 0.158 | 3.981 | 1.991 | −0.423 | 3.981 |
| −0.421 | −0.228 | 3.981 | −1.146 | 0.136 | 3.981 | 2.002 | −0.426 | 3.981 |
| −0.531 | −0.199 | 3.981 | −1.063 | 0.113 | 3.981 | 2.009 | −0.432 | 3.981 |
| −0.636 | −0.169 | 3.981 | −0.977 | 0.089 | 3.981 | 2.011 | −0.439 | 3.981 |
| −0.738 | −0.139 | 3.981 | −0.886 | 0.066 | 3.981 | | | |
| −0.835 | −0.107 | 3.981 | −0.792 | 0.042 | 3.981 | | | |
| 2.002 | −0.435 | 4.313 | −0.931 | −0.080 | 4.313 | −0.699 | 0.011 | 4.313 |
| 2.001 | −0.441 | 4.313 | −1.020 | −0.049 | 4.313 | −0.597 | −0.012 | 4.313 |
| 1.997 | −0.447 | 4.313 | −1.105 | −0.017 | 4.313 | −0.492 | −0.035 | 4.313 |
| 1.989 | −0.452 | 4.313 | −1.186 | 0.014 | 4.313 | −0.382 | −0.058 | 4.313 |
| 1.977 | −0.453 | 4.313 | −1.264 | 0.044 | 4.313 | −0.273 | −0.080 | 4.313 |
| 1.962 | −0.453 | 4.313 | −1.333 | 0.073 | 4.313 | −0.163 | −0.101 | 4.313 |
| 1.943 | −0.452 | 4.313 | −1.396 | 0.100 | 4.313 | −0.053 | −0.121 | 4.313 |
| 1.918 | −0.452 | 4.313 | −1.451 | 0.124 | 4.313 | 0.057 | −0.141 | 4.313 |
| 1.888 | −0.451 | 4.313 | −1.503 | 0.148 | 4.313 | 0.167 | −0.160 | 4.313 |
| 1.853 | −0.450 | 4.313 | −1.547 | 0.169 | 4.313 | 0.278 | −0.179 | 4.313 |
| 1.812 | −0.449 | 4.313 | −1.580 | 0.187 | 4.313 | 0.388 | −0.197 | 4.313 |
| 1.762 | −0.448 | 4.313 | −1.606 | 0.203 | 4.313 | 0.499 | −0.214 | 4.313 |
| 1.706 | −0.447 | 4.313 | −1.625 | 0.216 | 4.313 | 0.609 | −0.231 | 4.313 |
| 1.642 | −0.445 | 4.313 | −1.638 | 0.227 | 4.313 | 0.720 | −0.247 | 4.313 |
| 1.570 | −0.443 | 4.313 | −1.644 | 0.234 | 4.313 | 0.831 | −0.264 | 4.313 |
| 1.491 | −0.441 | 4.313 | −1.646 | 0.240 | 4.313 | 0.938 | −0.279 | 4.313 |
| 1.404 | −0.438 | 4.313 | −1.647 | 0.243 | 4.313 | 1.041 | −0.294 | 4.313 |
| 1.314 | −0.435 | 4.313 | −1.647 | 0.244 | 4.313 | 1.141 | −0.308 | 4.313 |
| 1.220 | −0.431 | 4.313 | −1.646 | 0.245 | 4.313 | 1.237 | −0.322 | 4.313 |
| 1.122 | −0.427 | 4.313 | −1.646 | 0.245 | 4.313 | 1.329 | −0.334 | 4.313 |
| 1.020 | −0.422 | 4.313 | −1.645 | 0.247 | 4.313 | 1.418 | −0.346 | 4.313 |
| 0.915 | −0.416 | 4.313 | −1.643 | 0.249 | 4.313 | 1.503 | −0.357 | 4.313 |
| 0.806 | −0.409 | 4.313 | −1.637 | 0.251 | 4.313 | 1.580 | −0.367 | 4.313 |
| 0.693 | −0.401 | 4.313 | −1.628 | 0.252 | 4.313 | 1.651 | −0.376 | 4.313 |
| 0.581 | −0.392 | 4.313 | −1.611 | 0.251 | 4.313 | 1.714 | −0.384 | 4.313 |
| 0.468 | −0.381 | 4.313 | −1.589 | 0.248 | 4.313 | 1.769 | −0.390 | 4.313 |
| 0.356 | −0.369 | 4.313 | −1.560 | 0.242 | 4.313 | 1.817 | −0.396 | 4.313 |
| 0.243 | −0.355 | 4.313 | −1.523 | 0.233 | 4.313 | 1.858 | −0.401 | 4.313 |
| 0.131 | −0.339 | 4.313 | −1.477 | 0.220 | 4.313 | 1.893 | −0.405 | 4.313 |
| 0.019 | −0.321 | 4.313 | −1.423 | 0.204 | 4.313 | 1.922 | −0.408 | 4.313 |

TABLE 16S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.092 | −0.301 | 4.313 | −1.366 | 0.187 | 4.313 | 1.946 | −0.411 | 4.313 |
| −0.203 | −0.280 | 4.313 | −1.301 | 0.169 | 4.313 | 1.965 | −0.413 | 4.313 |
| −0.314 | −0.255 | 4.313 | −1.229 | 0.148 | 4.313 | 1.980 | −0.414 | 4.313 |
| −0.424 | −0.229 | 4.313 | −1.150 | 0.126 | 4.313 | 1.991 | −0.417 | 4.313 |
| −0.534 | −0.201 | 4.313 | −1.068 | 0.104 | 4.313 | 1.998 | −0.423 | 4.313 |
| −0.639 | −0.171 | 4.313 | −0.981 | 0.081 | 4.313 | 2.001 | −0.430 | 4.313 |
| −0.741 | −0.141 | 4.313 | −0.891 | 0.058 | 4.313 | | | |
| −0.838 | −0.111 | 4.313 | −0.797 | 0.035 | 4.313 | | | |
| 1.960 | −0.436 | 4.976 | −0.970 | −0.041 | 4.976 | −0.736 | 0.037 | 4.976 |
| 1.959 | −0.441 | 4.976 | −1.058 | −0.007 | 4.976 | −0.635 | 0.012 | 4.976 |
| 1.955 | −0.448 | 4.976 | −1.141 | 0.028 | 4.976 | −0.530 | −0.014 | 4.976 |
| 1.947 | −0.452 | 4.976 | −1.221 | 0.063 | 4.976 | −0.421 | −0.039 | 4.976 |
| 1.935 | −0.453 | 4.976 | −1.297 | 0.097 | 4.976 | −0.312 | −0.063 | 4.976 |
| 1.920 | −0.453 | 4.976 | −1.365 | 0.129 | 4.976 | −0.202 | −0.086 | 4.976 |
| 1.900 | −0.453 | 4.976 | −1.426 | 0.159 | 4.976 | −0.093 | −0.107 | 4.976 |
| 1.876 | −0.452 | 4.976 | −1.481 | 0.187 | 4.976 | 0.017 | −0.128 | 4.976 |
| 1.846 | −0.452 | 4.976 | −1.531 | 0.213 | 4.976 | 0.127 | −0.148 | 4.976 |
| 1.810 | −0.451 | 4.976 | −1.574 | 0.237 | 4.976 | 0.238 | −0.167 | 4.976 |
| 1.769 | −0.450 | 4.976 | −1.607 | 0.256 | 4.976 | 0.348 | −0.186 | 4.976 |
| 1.719 | −0.449 | 4.976 | −1.633 | 0.273 | 4.976 | 0.458 | −0.204 | 4.976 |
| 1.663 | −0.448 | 4.976 | −1.651 | 0.287 | 4.976 | 0.569 | −0.222 | 4.976 |
| 1.598 | −0.446 | 4.976 | −1.664 | 0.298 | 4.976 | 0.679 | −0.239 | 4.976 |
| 1.526 | −0.445 | 4.976 | −1.670 | 0.305 | 4.976 | 0.790 | −0.256 | 4.976 |
| 1.447 | −0.442 | 4.976 | −1.673 | 0.311 | 4.976 | 0.897 | −0.273 | 4.976 |
| 1.360 | −0.440 | 4.976 | −1.673 | 0.314 | 4.976 | 1.000 | −0.288 | 4.976 |
| 1.269 | −0.437 | 4.976 | −1.673 | 0.315 | 4.976 | 1.100 | −0.303 | 4.976 |
| 1.174 | −0.434 | 4.976 | −1.673 | 0.316 | 4.976 | 1.196 | −0.317 | 4.976 |
| 1.076 | −0.430 | 4.976 | −1.672 | 0.317 | 4.976 | 1.288 | −0.331 | 4.976 |
| 0.974 | −0.425 | 4.976 | −1.671 | 0.318 | 4.976 | 1.377 | −0.343 | 4.976 |
| 0.868 | −0.419 | 4.976 | −1.669 | 0.319 | 4.976 | 1.462 | −0.355 | 4.976 |
| 0.759 | −0.411 | 4.976 | −1.663 | 0.320 | 4.976 | 1.539 | −0.365 | 4.976 |
| 0.646 | −0.402 | 4.976 | −1.653 | 0.320 | 4.976 | 1.610 | −0.375 | 4.976 |
| 0.533 | −0.392 | 4.976 | −1.637 | 0.318 | 4.976 | 1.673 | −0.383 | 4.976 |
| 0.420 | −0.380 | 4.976 | −1.615 | 0.313 | 4.976 | 1.728 | −0.390 | 4.976 |
| 0.307 | −0.366 | 4.976 | −1.586 | 0.305 | 4.976 | 1.776 | −0.395 | 4.976 |
| 0.195 | −0.351 | 4.976 | −1.551 | 0.293 | 4.976 | 1.817 | −0.400 | 4.976 |
| 0.082 | −0.333 | 4.976 | −1.505 | 0.277 | 4.976 | 1.852 | −0.405 | 4.976 |
| −0.030 | −0.313 | 4.976 | −1.452 | 0.259 | 4.976 | 1.881 | −0.408 | 4.976 |
| −0.141 | −0.291 | 4.976 | −1.396 | 0.239 | 4.976 | 1.905 | −0.411 | 4.976 |
| −0.252 | −0.266 | 4.976 | −1.332 | 0.217 | 4.976 | 1.924 | −0.413 | 4.976 |
| −0.362 | −0.238 | 4.976 | −1.261 | 0.194 | 4.976 | 1.939 | −0.415 | 4.976 |
| −0.471 | −0.209 | 4.976 | −1.183 | 0.168 | 4.976 | 1.950 | −0.417 | 4.976 |
| −0.579 | −0.177 | 4.976 | −1.102 | 0.142 | 4.976 | 1.957 | −0.423 | 4.976 |
| −0.683 | −0.144 | 4.976 | −1.016 | 0.116 | 4.976 | 1.960 | −0.430 | 4.976 |
| −0.783 | −0.110 | 4.976 | −0.927 | 0.090 | 4.976 | | | |
| −0.879 | −0.076 | 4.976 | −0.834 | 0.064 | 4.976 | | | |
| 1.921 | −0.440 | 5.308 | −1.007 | 0.001 | 5.308 | −0.774 | 0.067 | 5.308 |
| 1.920 | −0.445 | 5.308 | −1.094 | 0.041 | 5.308 | −0.673 | 0.038 | 5.308 |
| 1.916 | −0.452 | 5.308 | −1.176 | 0.080 | 5.308 | −0.569 | 0.009 | 5.308 |
| 1.908 | −0.456 | 5.308 | −1.255 | 0.119 | 5.308 | −0.460 | −0.019 | 5.308 |
| 1.896 | −0.457 | 5.308 | −1.329 | 0.158 | 5.308 | −0.351 | −0.046 | 5.308 |
| 1.881 | −0.457 | 5.308 | −1.397 | 0.194 | 5.308 | −0.242 | −0.071 | 5.308 |
| 1.861 | −0.457 | 5.308 | −1.457 | 0.227 | 5.308 | −0.133 | −0.094 | 5.308 |
| 1.837 | −0.457 | 5.308 | −1.509 | 0.258 | 5.308 | −0.023 | −0.117 | 5.308 |
| 1.806 | −0.456 | 5.308 | −1.558 | 0.287 | 5.308 | 0.087 | −0.138 | 5.308 |
| 1.771 | −0.456 | 5.308 | −1.600 | 0.314 | 5.308 | 0.197 | −0.160 | 5.308 |
| 1.729 | −0.455 | 5.308 | −1.632 | 0.335 | 5.308 | 0.307 | −0.180 | 5.308 |
| 1.680 | −0.454 | 5.308 | −1.657 | 0.353 | 5.308 | 0.418 | −0.199 | 5.308 |
| 1.622 | −0.453 | 5.308 | −1.674 | 0.367 | 5.308 | 0.528 | −0.218 | 5.308 |
| 1.558 | −0.451 | 5.308 | −1.687 | 0.379 | 5.308 | 0.639 | −0.237 | 5.308 |
| 1.486 | −0.450 | 5.308 | −1.693 | 0.387 | 5.308 | 0.749 | −0.254 | 5.308 |
| 1.406 | −0.448 | 5.308 | −1.696 | 0.392 | 5.308 | 0.856 | −0.271 | 5.308 |
| 1.318 | −0.446 | 5.308 | −1.696 | 0.395 | 5.308 | 0.960 | −0.287 | 5.308 |
| 1.227 | −0.444 | 5.308 | −1.696 | 0.397 | 5.308 | 1.060 | −0.303 | 5.308 |
| 1.132 | −0.440 | 5.308 | −1.696 | 0.397 | 5.308 | 1.156 | −0.317 | 5.308 |
| 1.033 | −0.437 | 5.308 | −1.695 | 0.398 | 5.308 | 1.248 | −0.331 | 5.308 |
| 0.931 | −0.432 | 5.308 | −1.694 | 0.399 | 5.308 | 1.337 | −0.344 | 5.308 |
| 0.825 | −0.426 | 5.308 | −1.691 | 0.400 | 5.308 | 1.422 | −0.357 | 5.308 |
| 0.715 | −0.418 | 5.308 | −1.685 | 0.400 | 5.308 | 1.499 | −0.367 | 5.308 |
| 0.601 | −0.409 | 5.308 | −1.676 | 0.399 | 5.308 | 1.570 | −0.377 | 5.308 |
| 0.488 | −0.397 | 5.308 | −1.659 | 0.395 | 5.308 | 1.633 | −0.385 | 5.308 |
| 0.376 | −0.384 | 5.308 | −1.638 | 0.388 | 5.308 | 1.688 | −0.392 | 5.308 |
| 0.263 | −0.368 | 5.308 | −1.610 | 0.378 | 5.308 | 1.737 | −0.398 | 5.308 |
| 0.152 | −0.350 | 5.308 | −1.576 | 0.363 | 5.308 | 1.777 | −0.404 | 5.308 |
| 0.040 | −0.330 | 5.308 | −1.531 | 0.344 | 5.308 | 1.812 | −0.408 | 5.308 |
| −0.070 | −0.307 | 5.308 | −1.479 | 0.322 | 5.308 | 1.842 | −0.412 | 5.308 |
| −0.181 | −0.282 | 5.308 | −1.424 | 0.299 | 5.308 | 1.866 | −0.415 | 5.308 |

TABLE 16S-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.290 | −0.253 | 5.308 | −1.362 | 0.274 | 5.308 | 1.885 | −0.417 | 5.308 |
| −0.400 | −0.222 | 5.308 | −1.292 | 0.246 | 5.308 | 1.900 | −0.419 | 5.308 |
| −0.508 | −0.189 | 5.308 | −1.216 | 0.217 | 5.308 | 1.911 | −0.421 | 5.308 |
| −0.617 | −0.153 | 5.308 | −1.135 | 0.187 | 5.308 | 1.918 | −0.427 | 5.308 |
| −0.721 | −0.115 | 5.308 | −1.051 | 0.157 | 5.308 | 1.921 | −0.434 | 5.308 |
| −0.820 | −0.077 | 5.308 | −0.962 | 0.127 | 5.308 | | | |
| −0.916 | −0.038 | 5.308 | −0.870 | 0.097 | 5.308 | | | |

The coordinate values given in TABLE 1R below provide the nominal profile envelope for an exemplary first stage rotor.

TABLE 1R

| X-LOC | Y-LOC | Z-LOC | X-LOC | Y-LOC | Z-LOC | X-LOC | Y-LOC | Z-LOC |
|---|---|---|---|---|---|---|---|---|
| 4.242 | 0.070 | 0.000 | −2.950 | 0.011 | 0.000 | −2.224 | 0.495 | 0.000 |
| 4.243 | 0.056 | 0.000 | −3.150 | 0.134 | 0.000 | −1.983 | 0.437 | 0.000 |
| 4.239 | 0.037 | 0.000 | −3.339 | 0.259 | 0.000 | −1.731 | 0.386 | 0.000 |
| 4.230 | 0.016 | 0.000 | −3.515 | 0.385 | 0.000 | −1.469 | 0.342 | 0.000 |
| 4.211 | −0.005 | 0.000 | −3.682 | 0.509 | 0.000 | −1.206 | 0.307 | 0.000 |
| 4.177 | −0.021 | 0.000 | −3.830 | 0.627 | 0.000 | −0.941 | 0.279 | 0.000 |
| 4.129 | −0.035 | 0.000 | −3.961 | 0.737 | 0.000 | −0.676 | 0.259 | 0.000 |
| 4.070 | −0.053 | 0.000 | −4.074 | 0.839 | 0.000 | −0.411 | 0.243 | 0.000 |
| 3.998 | −0.074 | 0.000 | −4.175 | 0.939 | 0.000 | −0.146 | 0.232 | 0.000 |
| 3.913 | −0.099 | 0.000 | −4.259 | 1.030 | 0.000 | 0.119 | 0.225 | 0.000 |
| 3.813 | −0.128 | 0.000 | −4.318 | 1.104 | 0.000 | 0.385 | 0.222 | 0.000 |
| 3.694 | −0.162 | 0.000 | −4.361 | 1.167 | 0.000 | 0.650 | 0.221 | 0.000 |
| 3.557 | −0.200 | 0.000 | −4.389 | 1.217 | 0.000 | 0.916 | 0.221 | 0.000 |
| 3.402 | −0.242 | 0.000 | −4.404 | 1.256 | 0.000 | 1.181 | 0.222 | 0.000 |
| 3.227 | −0.288 | 0.000 | −4.408 | 1.280 | 0.000 | 1.447 | 0.223 | 0.000 |
| 3.034 | −0.336 | 0.000 | −4.406 | 1.295 | 0.000 | 1.704 | 0.223 | 0.000 |
| 2.823 | −0.387 | 0.000 | −4.403 | 1.302 | 0.000 | 1.952 | 0.222 | 0.000 |
| 2.601 | −0.438 | 0.000 | −4.401 | 1.305 | 0.000 | 2.191 | 0.221 | 0.000 |
| 2.369 | −0.488 | 0.000 | −4.400 | 1.307 | 0.000 | 2.421 | 0.218 | 0.000 |
| 2.128 | −0.536 | 0.000 | −4.398 | 1.308 | 0.000 | 2.642 | 0.214 | 0.000 |
| 1.876 | −0.583 | 0.000 | −4.396 | 1.310 | 0.000 | 2.855 | 0.208 | 0.000 |
| 1.614 | −0.627 | 0.000 | −4.389 | 1.313 | 0.000 | 3.058 | 0.202 | 0.000 |
| 1.342 | −0.668 | 0.000 | −4.375 | 1.314 | 0.000 | 3.244 | 0.195 | 0.000 |
| 1.060 | −0.703 | 0.000 | −4.353 | 1.310 | 0.000 | 3.412 | 0.188 | 0.000 |
| 0.778 | −0.732 | 0.000 | −4.315 | 1.297 | 0.000 | 3.563 | 0.180 | 0.000 |
| 0.494 | −0.753 | 0.000 | −4.266 | 1.276 | 0.000 | 3.695 | 0.173 | 0.000 |
| 0.210 | −0.765 | 0.000 | −4.202 | 1.244 | 0.000 | 3.810 | 0.166 | 0.000 |
| −0.074 | −0.768 | 0.000 | −4.124 | 1.203 | 0.000 | 3.908 | 0.160 | 0.000 |
| −0.359 | −0.759 | 0.000 | −4.021 | 1.150 | 0.000 | 3.991 | 0.155 | 0.000 |
| −0.642 | −0.740 | 0.000 | −3.902 | 1.090 | 0.000 | 4.060 | 0.150 | 0.000 |
| −0.923 | −0.708 | 0.000 | −3.773 | 1.031 | 0.000 | 4.118 | 0.146 | 0.000 |
| −1.201 | −0.662 | 0.000 | −3.627 | 0.968 | 0.000 | 4.164 | 0.143 | 0.000 |
| −1.475 | −0.602 | 0.000 | −3.463 | 0.901 | 0.000 | 4.198 | 0.134 | 0.000 |
| −1.746 | −0.528 | 0.000 | −3.280 | 0.832 | 0.000 | 4.219 | 0.118 | 0.000 |
| −2.013 | −0.438 | 0.000 | −3.089 | 0.762 | 0.000 | 4.233 | 0.100 | 0.000 |
| −2.268 | −0.337 | 0.000 | −2.887 | 0.693 | 0.000 | 4.240 | 0.083 | 0.000 |
| −2.510 | −0.227 | 0.000 | −2.676 | 0.624 | 0.000 | | | |
| −2.737 | −0.110 | 0.000 | −2.455 | 0.558 | 0.000 | | | |
| 4.202 | −0.487 | 1.621 | −2.842 | 0.283 | 1.621 | −2.162 | 0.653 | 1.621 |
| 4.201 | −0.501 | 1.621 | −3.040 | 0.405 | 1.621 | −1.929 | 0.568 | 1.621 |
| 4.196 | −0.519 | 1.621 | −3.227 | 0.527 | 1.621 | −1.686 | 0.484 | 1.621 |
| 4.184 | −0.538 | 1.621 | −3.403 | 0.648 | 1.621 | −1.434 | 0.401 | 1.621 |
| 4.162 | −0.555 | 1.621 | −3.569 | 0.766 | 1.621 | −1.181 | 0.323 | 1.621 |
| 4.126 | −0.564 | 1.621 | −3.718 | 0.878 | 1.621 | −0.925 | 0.251 | 1.621 |
| 4.078 | −0.572 | 1.621 | −3.849 | 0.981 | 1.621 | −0.668 | 0.184 | 1.621 |
| 4.018 | −0.581 | 1.621 | −3.963 | 1.077 | 1.621 | −0.410 | 0.123 | 1.621 |
| 3.946 | −0.593 | 1.621 | −4.068 | 1.169 | 1.621 | −0.150 | 0.067 | 1.621 |
| 3.860 | −0.607 | 1.621 | −4.155 | 1.253 | 1.621 | 0.110 | 0.016 | 1.621 |
| 3.758 | −0.622 | 1.621 | −4.218 | 1.321 | 1.621 | 0.371 | −0.030 | 1.621 |
| 3.639 | −0.641 | 1.621 | −4.265 | 1.378 | 1.621 | 0.632 | −0.070 | 1.621 |
| 3.501 | −0.661 | 1.621 | −4.297 | 1.424 | 1.621 | 0.895 | −0.105 | 1.621 |
| 3.344 | −0.684 | 1.621 | −4.316 | 1.462 | 1.621 | 1.158 | −0.136 | 1.621 |
| 3.169 | −0.708 | 1.621 | −4.322 | 1.484 | 1.621 | 1.422 | −0.163 | 1.621 |
| 2.976 | −0.733 | 1.621 | −4.322 | 1.499 | 1.621 | 1.677 | −0.187 | 1.621 |
| 2.764 | −0.759 | 1.621 | −4.320 | 1.506 | 1.621 | 1.924 | −0.208 | 1.621 |
| 2.542 | −0.785 | 1.621 | −4.319 | 1.509 | 1.621 | 2.162 | −0.228 | 1.621 |
| 2.311 | −0.809 | 1.621 | −4.318 | 1.511 | 1.621 | 2.392 | −0.247 | 1.621 |

TABLE 1R-continued

| X-LOC | Y-LOC | Z-LOC | X-LOC | Y-LOC | Z-LOC | X-LOC | Y-LOC | Z-LOC |
|---|---|---|---|---|---|---|---|---|
| 2.070 | −0.831 | 1.621 | −4.316 | 1.512 | 1.621 | 2.612 | −0.266 | 1.621 |
| 1.820 | −0.850 | 1.621 | −4.314 | 1.514 | 1.621 | 2.823 | −0.284 | 1.621 |
| 1.560 | −0.864 | 1.621 | −4.307 | 1.517 | 1.621 | 3.026 | −0.303 | 1.621 |
| 1.291 | −0.872 | 1.621 | −4.293 | 1.519 | 1.621 | 3.211 | −0.320 | 1.621 |
| 1.012 | −0.871 | 1.621 | −4.271 | 1.516 | 1.621 | 3.378 | −0.336 | 1.621 |
| 0.734 | −0.862 | 1.621 | −4.233 | 1.505 | 1.621 | 3.528 | −0.351 | 1.621 |
| 0.455 | −0.842 | 1.621 | −4.183 | 1.485 | 1.621 | 3.660 | −0.365 | 1.621 |
| 0.178 | −0.811 | 1.621 | −4.118 | 1.457 | 1.621 | 3.774 | −0.377 | 1.621 |
| −0.097 | −0.769 | 1.621 | −4.038 | 1.419 | 1.621 | 3.871 | −0.387 | 1.621 |
| −0.371 | −0.716 | 1.621 | −3.935 | 1.369 | 1.621 | 3.954 | −0.396 | 1.621 |
| −0.643 | −0.653 | 1.621 | −3.814 | 1.313 | 1.621 | 4.023 | −0.404 | 1.621 |
| −0.912 | −0.581 | 1.621 | −3.685 | 1.255 | 1.621 | 4.080 | −0.410 | 1.621 |
| −1.177 | −0.499 | 1.621 | −3.538 | 1.193 | 1.621 | 4.126 | −0.416 | 1.621 |
| −1.437 | −0.407 | 1.621 | −3.375 | 1.125 | 1.621 | 4.161 | −0.423 | 1.621 |
| −1.694 | −0.306 | 1.621 | −3.194 | 1.053 | 1.621 | 4.182 | −0.439 | 1.621 |
| −1.946 | −0.195 | 1.621 | −3.005 | 0.977 | 1.621 | 4.195 | −0.457 | 1.621 |
| −2.187 | −0.080 | 1.621 | −2.807 | 0.900 | 1.621 | 4.201 | −0.474 | 1.621 |
| −2.416 | 0.039 | 1.621 | −2.600 | 0.820 | 1.621 | | | |
| −2.635 | 0.160 | 1.621 | −2.385 | 0.737 | 1.621 | | | |
| 4.033 | −0.992 | 3.241 | −2.848 | 0.509 | 3.241 | −2.188 | 0.772 | 3.241 |
| 4.030 | −1.005 | 3.241 | −3.038 | 0.638 | 3.241 | −1.961 | 0.672 | 3.241 |
| 4.023 | −1.022 | 3.241 | −3.218 | 0.765 | 3.241 | −1.726 | 0.570 | 3.241 |
| 4.008 | −1.039 | 3.241 | −3.389 | 0.889 | 3.241 | −1.481 | 0.466 | 3.241 |
| 3.984 | −1.051 | 3.241 | −3.550 | 1.010 | 3.241 | −1.236 | 0.365 | 3.241 |
| 3.947 | −1.054 | 3.241 | −3.695 | 1.123 | 3.241 | −0.989 | 0.268 | 3.241 |
| 3.899 | −1.056 | 3.241 | −3.824 | 1.227 | 3.241 | −0.740 | 0.176 | 3.241 |
| 3.840 | −1.059 | 3.241 | −3.936 | 1.321 | 3.241 | −0.489 | 0.089 | 3.241 |
| 3.767 | −1.062 | 3.241 | −4.039 | 1.413 | 3.241 | −0.238 | 0.007 | 3.241 |
| 3.681 | −1.066 | 3.241 | −4.126 | 1.495 | 3.241 | 0.015 | −0.071 | 3.241 |
| 3.580 | −1.070 | 3.241 | −4.189 | 1.561 | 3.241 | 0.270 | −0.143 | 3.241 |
| 3.461 | −1.074 | 3.241 | −4.236 | 1.618 | 3.241 | 0.526 | −0.210 | 3.241 |
| 3.323 | −1.079 | 3.241 | −4.268 | 1.662 | 3.241 | 0.783 | −0.272 | 3.241 |
| 3.167 | −1.083 | 3.241 | −4.288 | 1.699 | 3.241 | 1.041 | −0.331 | 3.241 |
| 2.993 | −1.087 | 3.241 | −4.296 | 1.720 | 3.241 | 1.300 | −0.387 | 3.241 |
| 2.800 | −1.090 | 3.241 | −4.297 | 1.735 | 3.241 | 1.552 | −0.438 | 3.241 |
| 2.589 | −1.091 | 3.241 | −4.295 | 1.742 | 3.241 | 1.795 | −0.485 | 3.241 |
| 2.369 | −1.090 | 3.241 | −4.294 | 1.745 | 3.241 | 2.029 | −0.529 | 3.241 |
| 2.140 | −1.086 | 3.241 | −4.292 | 1.747 | 3.241 | 2.255 | −0.572 | 3.241 |
| 1.901 | −1.079 | 3.241 | −4.291 | 1.748 | 3.241 | 2.472 | −0.613 | 3.241 |
| 1.654 | −1.067 | 3.241 | −4.288 | 1.750 | 3.241 | 2.681 | −0.652 | 3.241 |
| 1.398 | −1.048 | 3.241 | −4.282 | 1.753 | 3.241 | 2.880 | −0.691 | 3.241 |
| 1.133 | −1.023 | 3.241 | −4.267 | 1.753 | 3.241 | 3.062 | −0.727 | 3.241 |
| 0.860 | −0.989 | 3.241 | −4.246 | 1.748 | 3.241 | 3.227 | −0.760 | 3.241 |
| 0.588 | −0.946 | 3.241 | −4.208 | 1.735 | 3.241 | 3.374 | −0.790 | 3.241 |
| 0.317 | −0.895 | 3.241 | −4.160 | 1.714 | 3.241 | 3.504 | −0.817 | 3.241 |
| 0.048 | −0.834 | 3.241 | −4.096 | 1.682 | 3.241 | 3.617 | −0.841 | 3.241 |
| −0.218 | −0.765 | 3.241 | −4.019 | 1.640 | 3.241 | 3.712 | −0.861 | 3.241 |
| −0.481 | −0.686 | 3.241 | −3.918 | 1.584 | 3.241 | 3.793 | −0.879 | 3.241 |
| −0.741 | −0.597 | 3.241 | −3.801 | 1.522 | 3.241 | 3.861 | −0.894 | 3.241 |
| −0.998 | −0.499 | 3.241 | −3.674 | 1.458 | 3.241 | 3.917 | −0.907 | 3.241 |
| −1.252 | −0.391 | 3.241 | −3.531 | 1.388 | 3.241 | 3.962 | −0.917 | 3.241 |
| −1.501 | −0.275 | 3.241 | −3.372 | 1.312 | 3.241 | 3.996 | −0.926 | 3.241 |
| −1.747 | −0.151 | 3.241 | −3.195 | 1.230 | 3.241 | 4.017 | −0.943 | 3.241 |
| −1.988 | −0.020 | 3.241 | −3.010 | 1.145 | 3.241 | 4.028 | −0.961 | 3.241 |
| −2.219 | 0.112 | 3.241 | −2.817 | 1.057 | 3.241 | 4.032 | −0.978 | 3.241 |
| −2.439 | 0.245 | 3.241 | −2.615 | 0.965 | 3.241 | | | |
| −2.649 | 0.378 | 3.241 | −2.406 | 0.870 | 3.241 | | | |
| 3.861 | −1.521 | 5.402 | −2.796 | 0.685 | 5.402 | −2.126 | 0.904 | 5.402 |
| 3.857 | −1.534 | 5.402 | −2.978 | 0.822 | 5.402 | −1.908 | 0.788 | 5.402 |
| 3.847 | −1.549 | 5.402 | −3.151 | 0.955 | 5.402 | −1.682 | 0.668 | 5.402 |
| 3.829 | −1.562 | 5.402 | −3.315 | 1.085 | 5.402 | −1.448 | 0.545 | 5.402 |
| 3.802 | −1.567 | 5.402 | −3.470 | 1.212 | 5.402 | −1.213 | 0.422 | 5.402 |
| 3.766 | −1.565 | 5.402 | −3.609 | 1.329 | 5.402 | −0.977 | 0.302 | 5.402 |
| 3.719 | −1.562 | 5.402 | −3.732 | 1.438 | 5.402 | −0.740 | 0.185 | 5.402 |
| 3.659 | −1.559 | 5.402 | −3.839 | 1.536 | 5.402 | −0.501 | 0.073 | 5.402 |
| 3.588 | −1.554 | 5.402 | −3.938 | 1.630 | 5.402 | −0.260 | −0.036 | 5.402 |
| 3.502 | −1.549 | 5.402 | −4.021 | 1.715 | 5.402 | −0.018 | −0.140 | 5.402 |
| 3.402 | −1.542 | 5.402 | −4.081 | 1.783 | 5.402 | 0.226 | −0.241 | 5.402 |
| 3.284 | −1.533 | 5.402 | −4.127 | 1.840 | 5.402 | 0.472 | −0.337 | 5.402 |
| 3.148 | −1.523 | 5.402 | −4.157 | 1.885 | 5.402 | 0.719 | −0.430 | 5.402 |
| 2.994 | −1.510 | 5.402 | −4.176 | 1.921 | 5.402 | 0.968 | −0.520 | 5.402 |
| 2.822 | −1.495 | 5.402 | −4.183 | 1.943 | 5.402 | 1.217 | −0.606 | 5.402 |
| 2.632 | −1.476 | 5.402 | −4.184 | 1.957 | 5.402 | 1.460 | −0.688 | 5.402 |
| 2.423 | −1.454 | 5.402 | −4.182 | 1.964 | 5.402 | 1.694 | −0.764 | 5.402 |
| 2.206 | −1.427 | 5.402 | −4.181 | 1.968 | 5.402 | 1.921 | −0.837 | 5.402 |
| 1.981 | −1.397 | 5.402 | −4.179 | 1.969 | 5.402 | 2.139 | −0.907 | 5.402 |
| 1.747 | −1.361 | 5.402 | −4.178 | 1.970 | 5.402 | 2.349 | −0.974 | 5.402 |

TABLE 1R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.505 | −1.319 | 5.402 | −4.175 | 1.972 | 5.402 | 2.551 | −1.038 | 5.402 |
| 1.255 | −1.271 | 5.402 | −4.168 | 1.974 | 5.402 | 2.744 | −1.100 | 5.402 |
| 0.997 | −1.214 | 5.402 | −4.154 | 1.974 | 5.402 | 2.921 | −1.157 | 5.402 |
| 0.733 | −1.147 | 5.402 | −4.133 | 1.968 | 5.402 | 3.080 | −1.208 | 5.402 |
| 0.470 | −1.073 | 5.402 | −4.096 | 1.953 | 5.402 | 3.222 | −1.255 | 5.402 |
| 0.210 | −0.990 | 5.402 | −4.048 | 1.930 | 5.402 | 3.348 | −1.296 | 5.402 |
| −0.047 | −0.899 | 5.402 | −3.987 | 1.896 | 5.402 | 3.457 | −1.332 | 5.402 |
| −0.301 | −0.799 | 5.402 | −3.911 | 1.851 | 5.402 | 3.549 | −1.363 | 5.402 |
| −0.552 | −0.691 | 5.402 | −3.812 | 1.793 | 5.402 | 3.627 | −1.389 | 5.402 |
| −0.799 | −0.575 | 5.402 | −3.697 | 1.728 | 5.402 | 3.693 | −1.412 | 5.402 |
| −1.042 | −0.452 | 5.402 | −3.573 | 1.660 | 5.402 | 3.747 | −1.431 | 5.402 |
| −1.262 | −0.321 | 5.402 | −3.433 | 1.584 | 5.402 | 3.791 | −1.446 | 5.402 |
| −1.517 | −0.183 | 5.402 | −3.277 | 1.503 | 5.402 | 3.824 | −1.458 | 5.402 |
| −1.749 | −0.039 | 5.402 | −3.104 | 1.414 | 5.402 | 3.846 | −1.472 | 5.402 |
| −1.978 | 0.109 | 5.402 | −2.924 | 1.321 | 5.402 | 3.858 | −1.491 | 5.402 |
| −2.197 | 0.256 | 5.402 | −2.736 | 1.224 | 5.402 | 3.862 | −1.508 | 5.402 |
| −2.406 | 0.402 | 5.402 | −2.540 | 1.122 | 5.402 | | | |
| −2.606 | 0.545 | 5.402 | −2.337 | 1.015 | 5.402 | | | |
| 3.595 | −1.974 | 7.563 | −2.751 | 0.930 | 7.563 | −2.116 | 1.035 | 7.563 |
| 3.590 | −1.986 | 7.563 | −2.924 | 1.073 | 7.563 | −1.907 | 0.904 | 7.563 |
| 3.576 | −1.998 | 7.563 | −3.090 | 1.211 | 7.563 | −1.691 | 0.767 | 7.563 |
| 3.555 | −2.002 | 7.563 | −3.247 | 1.346 | 7.563 | −1.468 | 0.625 | 7.563 |
| 3.528 | −1.997 | 7.563 | −3.396 | 1.476 | 7.563 | −1.246 | 0.482 | 7.563 |
| 3.492 | −1.991 | 7.563 | −3.531 | 1.595 | 7.563 | −1.023 | 0.340 | 7.563 |
| 3.446 | −1.983 | 7.563 | −3.651 | 1.705 | 7.563 | −0.799 | 0.200 | 7.563 |
| 3.389 | −1.973 | 7.563 | −3.756 | 1.803 | 7.563 | −0.574 | 0.063 | 7.563 |
| 3.319 | −1.960 | 7.563 | −3.853 | 1.897 | 7.563 | −0.347 | −0.072 | 7.563 |
| 3.235 | −1.944 | 7.563 | −3.935 | 1.981 | 7.563 | −0.118 | −0.203 | 7.563 |
| 3.138 | −1.924 | 7.563 | −3.995 | 2.048 | 7.563 | 0.113 | −0.330 | 7.563 |
| 3.023 | −1.901 | 7.563 | −4.040 | 2.104 | 7.563 | 0.345 | −0.454 | 7.563 |
| 2.891 | −1.874 | 7.563 | −4.070 | 2.149 | 7.563 | 0.579 | −0.574 | 7.563 |
| 2.741 | −1.843 | 7.563 | −4.089 | 2.184 | 7.563 | 0.815 | −0.691 | 7.563 |
| 2.574 | −1.806 | 7.563 | −4.097 | 2.206 | 7.563 | 1.053 | −0.805 | 7.563 |
| 2.389 | −1.764 | 7.563 | −4.098 | 2.220 | 7.563 | 1.284 | −0.913 | 7.563 |
| 2.188 | −1.716 | 7.563 | −4.097 | 2.227 | 7.563 | 1.508 | −1.015 | 7.563 |
| 1.978 | −1.662 | 7.563 | −4.095 | 2.230 | 7.563 | 1.724 | −1.112 | 7.563 |
| 1.761 | −1.603 | 7.563 | −4.094 | 2.232 | 7.563 | 1.933 | −1.205 | 7.563 |
| 1.537 | −1.538 | 7.563 | −4.093 | 2.233 | 7.563 | 2.135 | −1.294 | 7.563 |
| 1.304 | −1.466 | 7.563 | −4.089 | 2.235 | 7.563 | 2.328 | −1.378 | 7.563 |
| 1.065 | −1.386 | 7.563 | −4.082 | 2.235 | 7.563 | 2.514 | −1.459 | 7.563 |
| 0.819 | −1.297 | 7.563 | −4.068 | 2.233 | 7.563 | 2.683 | −1.533 | 7.563 |
| 0.568 | −1.199 | 7.563 | −4.048 | 2.226 | 7.563 | 2.836 | −1.600 | 7.563 |
| 0.320 | −1.094 | 7.563 | −4.012 | 2.208 | 7.563 | 2.973 | −1.660 | 7.563 |
| 0.075 | −0.981 | 7.563 | −3.967 | 2.181 | 7.563 | 3.094 | −1.713 | 7.563 |
| −0.167 | −0.862 | 7.563 | −3.908 | 2.142 | 7.563 | 3.199 | −1.758 | 7.563 |
| −0.406 | −0.735 | 7.563 | −3.835 | 2.093 | 7.563 | 3.288 | −1.797 | 7.563 |
| −0.641 | −0.601 | 7.563 | −3.740 | 2.029 | 7.563 | 3.363 | −1.830 | 7.563 |
| −0.872 | −0.461 | 7.563 | −3.628 | 1.958 | 7.563 | 3.427 | −1.859 | 7.563 |
| −1.100 | −0.314 | 7.563 | −3.509 | 1.884 | 7.563 | 3.479 | −1.882 | 7.563 |
| −1.323 | −0.163 | 7.563 | −3.373 | 1.801 | 7.563 | 3.521 | −1.902 | 7.563 |
| −1.543 | −0.006 | 7.563 | −3.222 | 1.710 | 7.563 | 3.552 | −1.916 | 7.563 |
| −1.760 | 0.154 | 7.563 | −3.056 | 1.610 | 7.563 | 3.576 | −1.928 | 7.563 |
| −1.975 | 0.316 | 7.563 | −2.883 | 1.505 | 7.563 | 3.592 | −1.943 | 7.563 |
| −2.182 | 0.476 | 7.563 | −2.702 | 1.395 | 7.563 | 3.597 | −1.961 | 7.563 |
| −2.380 | 0.631 | 7.563 | −2.513 | 1.281 | 7.563 | | | |
| −2.569 | 0.782 | 7.563 | −2.318 | 1.161 | 7.563 | | | |
| 3.352 | −2.370 | 9.724 | −2.648 | 1.146 | 9.724 | −2.090 | 1.108 | 9.724 |
| 3.344 | −2.381 | 9.724 | −2.816 | 1.292 | 9.724 | −1.892 | 0.962 | 9.724 |
| 3.328 | −2.387 | 9.724 | −2.977 | 1.433 | 9.724 | −1.687 | 0.811 | 9.724 |
| 3.306 | −2.382 | 9.724 | −3.131 | 1.569 | 9.724 | −1.475 | 0.653 | 9.724 |
| 3.281 | −2.374 | 9.724 | −3.277 | 1.700 | 9.724 | −1.264 | 0.495 | 9.724 |
| 3.247 | −2.362 | 9.724 | −3.409 | 1.820 | 9.724 | −1.053 | 0.336 | 9.724 |
| 3.203 | −2.348 | 9.724 | −3.526 | 1.929 | 9.724 | −0.842 | 0.178 | 9.724 |
| 3.148 | −2.329 | 9.724 | −3.629 | 2.027 | 9.724 | −0.630 | 0.021 | 9.724 |
| 3.082 | −2.306 | 9.724 | −3.725 | 2.121 | 9.724 | −0.416 | −0.134 | 9.724 |
| 3.003 | −2.278 | 9.724 | −3.806 | 2.203 | 9.724 | −0.201 | −0.286 | 9.724 |
| 2.911 | −2.245 | 9.724 | −3.866 | 2.269 | 9.724 | 0.016 | −0.436 | 9.724 |
| 2.802 | −2.206 | 9.724 | −3.911 | 2.325 | 9.724 | 0.235 | −0.583 | 9.724 |
| 2.676 | −2.161 | 9.724 | −3.942 | 2.368 | 9.724 | 0.456 | −0.727 | 9.724 |
| 2.534 | −2.109 | 9.724 | −3.962 | 2.403 | 9.724 | 0.678 | −0.868 | 9.724 |
| 2.375 | −2.051 | 9.724 | −3.970 | 2.424 | 9.724 | 0.903 | −1.006 | 9.724 |
| 2.200 | −1.985 | 9.724 | −3.972 | 2.438 | 9.724 | 1.122 | −1.137 | 9.724 |
| 2.010 | −1.910 | 9.724 | −3.971 | 2.445 | 9.724 | 1.336 | −1.260 | 9.724 |
| 1.812 | −1.831 | 9.724 | −3.969 | 2.448 | 9.724 | 1.543 | −1.376 | 9.724 |
| 1.607 | −1.745 | 9.724 | −3.968 | 2.450 | 9.724 | 1.743 | −1.487 | 9.724 |
| 1.395 | −1.652 | 9.724 | −3.967 | 2.451 | 9.724 | 1.937 | −1.592 | 9.724 |
| 1.177 | −1.552 | 9.724 | −3.964 | 2.452 | 9.724 | 2.123 | −1.691 | 9.724 |

TABLE 1R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.952 | −1.443 | 9.724 | −3.956 | 2.452 | 9.724 | 2.302 | −1.786 | 9.724 |
| 0.722 | −1.324 | 9.724 | −3.943 | 2.448 | 9.724 | 2.466 | −1.872 | 9.724 |
| 0.488 | −1.196 | 9.724 | −3.923 | 2.438 | 9.724 | 2.614 | −1.950 | 9.724 |
| 0.256 | −1.063 | 9.724 | −3.889 | 2.418 | 9.724 | 2.746 | −2.020 | 9.724 |
| 0.028 | −0.924 | 9.724 | −3.847 | 2.387 | 9.724 | 2.863 | −2.081 | 9.724 |
| −0.197 | −0.780 | 9.724 | −3.791 | 2.344 | 9.724 | 2.964 | −2.135 | 9.724 |
| −0.419 | −0.631 | 9.724 | −3.722 | 2.289 | 9.724 | 3.050 | −2.180 | 9.724 |
| −0.638 | −0.477 | 9.724 | −3.632 | 2.219 | 9.724 | 3.123 | −2.218 | 9.724 |
| −0.854 | −0.319 | 9.724 | −3.526 | 2.140 | 9.724 | 3.184 | −2.251 | 9.724 |
| −1.067 | −0.158 | 9.724 | −3.412 | 2.057 | 9.724 | 3.235 | −2.278 | 9.724 |
| −1.277 | 0.007 | 9.724 | −3.284 | 1.964 | 9.724 | 3.275 | −2.300 | 9.724 |
| −1.486 | 0.175 | 9.724 | −3.141 | 1.862 | 9.724 | 3.306 | −2.317 | 9.724 |
| −1.693 | 0.343 | 9.724 | −2.983 | 1.750 | 9.724 | 3.329 | −2.329 | 9.724 |
| −1.899 | 0.513 | 9.724 | −2.818 | 1.633 | 9.724 | 3.347 | −2.341 | 9.724 |
| −2.098 | 0.679 | 9.724 | −2.646 | 1.510 | 9.724 | 3.354 | −2.357 | 9.724 |
| −2.289 | 0.839 | 9.724 | −2.468 | 1.382 | 9.724 | | | |
| −2.472 | 0.995 | 9.724 | −2.282 | 1.248 | 9.724 | | | |
| 3.205 | −2.560 | 10.805 | −2.593 | 1.260 | 10.805 | −2.072 | 1.159 | 10.805 |
| 3.197 | −2.571 | 10.805 | −2.757 | 1.409 | 10.805 | −1.880 | 1.006 | 10.805 |
| 3.179 | −2.573 | 10.805 | −2.915 | 1.553 | 10.805 | −1.681 | 0.846 | 10.805 |
| 3.158 | −2.565 | 10.805 | −3.065 | 1.691 | 10.805 | −1.475 | 0.681 | 10.805 |
| 3.134 | −2.555 | 10.805 | −3.208 | 1.823 | 10.805 | −1.270 | 0.516 | 10.805 |
| 3.101 | −2.542 | 10.805 | −3.337 | 1.945 | 10.805 | −1.065 | 0.350 | 10.805 |
| 3.058 | −2.524 | 10.805 | −3.453 | 2.055 | 10.805 | −0.860 | 0.184 | 10.805 |
| 3.005 | −2.502 | 10.805 | −3.555 | 2.154 | 10.805 | −0.655 | 0.018 | 10.805 |
| 2.940 | −2.474 | 10.805 | −3.649 | 2.248 | 10.805 | −0.449 | −0.146 | 10.805 |
| 2.864 | −2.441 | 10.805 | −3.730 | 2.331 | 10.805 | −0.241 | −0.309 | 10.805 |
| 2.774 | −2.402 | 10.805 | −3.789 | 2.397 | 10.805 | −0.032 | −0.470 | 10.805 |
| 2.669 | −2.356 | 10.805 | −3.834 | 2.452 | 10.805 | 0.178 | −0.629 | 10.805 |
| 2.547 | −2.303 | 10.805 | −3.865 | 2.496 | 10.805 | 0.390 | −0.785 | 10.805 |
| 2.409 | −2.242 | 10.805 | −3.884 | 2.530 | 10.805 | 0.604 | −0.938 | 10.805 |
| 2.255 | −2.173 | 10.805 | −3.893 | 2.551 | 10.805 | 0.821 | −1.088 | 10.805 |
| 2.085 | −2.095 | 10.805 | −3.895 | 2.565 | 10.805 | 1.032 | −1.230 | 10.805 |
| 1.901 | −2.009 | 10.805 | −3.894 | 2.572 | 10.805 | 1.239 | −1.363 | 10.805 |
| 1.709 | −1.916 | 10.805 | −3.893 | 2.575 | 10.805 | 1.440 | −1.490 | 10.805 |
| 1.510 | −1.818 | 10.805 | −3.892 | 2.577 | 10.805 | 1.635 | −1.609 | 10.805 |
| 1.305 | −1.712 | 10.805 | −3.890 | 2.578 | 10.805 | 1.824 | −1.722 | 10.805 |
| 1.095 | −1.597 | 10.805 | −3.887 | 2.579 | 10.805 | 2.005 | −1.829 | 10.805 |
| 0.879 | −1.474 | 10.805 | −3.880 | 2.578 | 10.805 | 2.180 | −1.932 | 10.805 |
| 0.659 | −1.341 | 10.805 | −3.866 | 2.573 | 10.805 | 2.339 | −2.025 | 10.805 |
| 0.435 | −1.198 | 10.805 | −3.847 | 2.563 | 10.805 | 2.483 | −2.110 | 10.805 |
| 0.214 | −1.050 | 10.805 | −3.814 | 2.540 | 10.805 | 2.612 | −2.185 | 10.805 |
| −0.004 | −0.897 | 10.805 | −3.773 | 2.508 | 10.805 | 2.726 | −2.252 | 10.805 |
| −0.219 | −0.741 | 10.805 | −3.720 | 2.462 | 10.805 | 2.825 | −2.310 | 10.805 |
| −0.431 | −0.580 | 10.805 | −3.653 | 2.405 | 10.805 | 2.908 | −2.358 | 10.805 |
| −0.641 | −0.416 | 10.805 | −3.565 | 2.332 | 10.805 | 2.980 | −2.400 | 10.805 |
| −0.848 | −0.249 | 10.805 | −3.463 | 2.249 | 10.805 | 3.039 | −2.435 | 10.805 |
| −1.054 | −0.080 | 10.805 | −3.353 | 2.161 | 10.805 | 3.089 | −2.464 | 10.805 |
| −1.258 | 0.092 | 10.805 | −3.228 | 2.064 | 10.805 | 3.128 | −2.488 | 10.805 |
| −1.460 | 0.264 | 10.805 | −3.089 | 1.956 | 10.805 | 3.158 | −2.506 | 10.805 |
| −1.662 | 0.438 | 10.805 | −2.937 | 1.837 | 10.805 | 3.180 | −2.520 | 10.805 |
| −1.863 | 0.613 | 10.805 | −2.777 | 1.713 | 10.805 | 3.199 | −2.532 | 10.805 |
| −2.056 | 0.782 | 10.805 | −2.611 | 1.583 | 10.805 | 3.207 | −2.547 | 10.805 |
| −2.243 | 0.947 | 10.805 | −2.438 | 1.447 | 10.805 | | | |
| −2.421 | 1.106 | 10.805 | −2.258 | 1.306 | 10.805 | | | |
| 2.899 | −2.814 | 12.966 | −2.483 | 1.518 | 12.966 | −2.009 | 1.342 | 12.966 |
| 2.889 | −2.823 | 12.966 | −2.637 | 1.676 | 12.966 | −1.830 | 1.175 | 12.966 |
| 2.872 | −2.820 | 12.966 | −2.784 | 1.828 | 12.966 | −1.644 | 1.002 | 12.966 |
| 2.852 | −2.810 | 12.966 | −2.925 | 1.974 | 12.966 | −1.453 | 0.822 | 12.966 |
| 2.829 | −2.798 | 12.966 | −3.060 | 2.114 | 12.966 | −1.262 | 0.642 | 12.966 |
| 2.797 | −2.782 | 12.966 | −3.181 | 2.242 | 12.966 | −1.071 | 0.461 | 12.966 |
| 2.756 | −2.761 | 12.966 | −3.290 | 2.357 | 12.966 | −0.881 | 0.280 | 12.966 |
| 2.705 | −2.735 | 12.966 | −3.386 | 2.461 | 12.966 | −0.691 | 0.099 | 12.966 |
| 2.644 | −2.702 | 12.966 | −3.474 | 2.559 | 12.966 | −0.502 | −0.082 | 12.966 |
| 2.571 | −2.663 | 12.966 | −3.550 | 2.645 | 12.966 | −0.312 | −0.264 | 12.966 |
| 2.485 | −2.617 | 12.966 | −3.606 | 2.713 | 12.966 | −0.121 | −0.444 | 12.966 |
| 2.385 | −2.563 | 12.966 | −3.648 | 2.770 | 12.966 | 0.071 | −0.624 | 12.966 |
| 2.268 | −2.500 | 12.966 | −3.677 | 2.814 | 12.966 | 0.264 | −0.802 | 12.966 |
| 2.137 | −2.428 | 12.966 | −3.695 | 2.849 | 12.966 | 0.459 | −0.978 | 12.966 |
| 1.991 | −2.346 | 12.966 | −3.703 | 2.870 | 12.966 | 0.656 | −1.150 | 12.966 |
| 1.830 | −2.253 | 12.966 | −3.705 | 2.884 | 12.966 | 0.851 | −1.314 | 12.966 |
| 1.656 | −2.150 | 12.966 | −3.704 | 2.891 | 12.966 | 1.042 | −1.468 | 12.966 |
| 1.475 | −2.039 | 12.966 | −3.703 | 2.894 | 12.966 | 1.228 | −1.613 | 12.966 |
| 1.290 | −1.920 | 12.966 | −3.702 | 2.895 | 12.966 | 1.410 | −1.750 | 12.966 |
| 1.100 | −1.793 | 12.966 | −3.700 | 2.896 | 12.966 | 1.587 | −1.879 | 12.966 |
| 0.906 | −1.655 | 12.966 | −3.697 | 2.897 | 12.966 | 1.758 | −2.001 | 12.966 |
| 0.708 | −1.507 | 12.966 | −3.690 | 2.895 | 12.966 | 1.923 | −2.117 | 12.966 |

TABLE 1R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.507 | −1.349 | 12.966 | −3.677 | 2.889 | 12.966 | 2.074 | −2.222 | 12.966 |
| 0.303 | −1.180 | 12.966 | −3.659 | 2.876 | 12.966 | 2.211 | −2.316 | 12.966 |
| 0.104 | −1.007 | 12.966 | −3.629 | 2.851 | 12.966 | 2.334 | −2.401 | 12.966 |
| −0.093 | −0.830 | 12.966 | −3.591 | 2.815 | 12.966 | 2.442 | −2.475 | 12.966 |
| −0.287 | −0.651 | 12.966 | −3.542 | 2.765 | 12.966 | 2.536 | −2.540 | 12.966 |
| −0.479 | −0.469 | 12.966 | −3.480 | 2.703 | 12.966 | 2.615 | −2.594 | 12.966 |
| −0.670 | −0.285 | 12.966 | −3.399 | 2.623 | 12.966 | 2.683 | −2.641 | 12.966 |
| −0.860 | −0.101 | 12.966 | −3.304 | 2.533 | 12.966 | 2.740 | −2.680 | 12.966 |
| −1.049 | 0.084 | 12.966 | −3.201 | 2.437 | 12.966 | 2.787 | −2.713 | 12.966 |
| −1.237 | 0.270 | 12.966 | −3.085 | 2.331 | 12.966 | 2.824 | −2.739 | 12.966 |
| −1.425 | 0.456 | 12.966 | −2.956 | 2.212 | 12.966 | 2.853 | −2.759 | 12.966 |
| −1.613 | 0.642 | 12.966 | −2.814 | 2.082 | 12.966 | 2.874 | −2.775 | 12.966 |
| −1.800 | 0.829 | 12.966 | −2.666 | 1.946 | 12.966 | 2.892 | −2.787 | 12.966 |
| −1.981 | 1.010 | 12.966 | −2.511 | 1.804 | 12.966 | 2.901 | −2.801 | 12.966 |
| −2.155 | 1.185 | 12.966 | −2.350 | 1.656 | 12.966 | | | |
| −2.322 | 1.355 | 12.966 | −2.183 | 1.502 | 12.966 | | | |
| 2.647 | −2.866 | 14.587 | −2.444 | 1.737 | 14.587 | −1.988 | 1.532 | 14.587 |
| 2.636 | −2.874 | 14.587 | −2.590 | 1.900 | 14.587 | −1.817 | 1.359 | 14.587 |
| 2.620 | −2.870 | 14.587 | −2.730 | 2.057 | 14.587 | −1.640 | 1.179 | 14.587 |
| 2.600 | −2.859 | 14.587 | −2.863 | 2.208 | 14.587 | −1.458 | 0.993 | 14.587 |
| 2.577 | −2.847 | 14.587 | −2.990 | 2.353 | 14.587 | −1.276 | 0.806 | 14.587 |
| 2.546 | −2.830 | 14.587 | −3.105 | 2.485 | 14.587 | −1.094 | 0.619 | 14.587 |
| 2.507 | −2.808 | 14.587 | −3.207 | 2.605 | 14.587 | −0.913 | 0.432 | 14.587 |
| 2.457 | −2.781 | 14.587 | −3.297 | 2.713 | 14.587 | −0.732 | 0.244 | 14.587 |
| 2.396 | −2.747 | 14.587 | −3.380 | 2.815 | 14.587 | −0.551 | 0.055 | 14.587 |
| 2.325 | −2.706 | 14.587 | −3.450 | 2.905 | 14.587 | −0.371 | −0.133 | 14.587 |
| 2.242 | −2.657 | 14.587 | −3.502 | 2.975 | 14.587 | −0.191 | −0.321 | 14.587 |
| 2.144 | −2.599 | 14.587 | −3.540 | 3.034 | 14.587 | −0.011 | −0.510 | 14.587 |
| 2.031 | −2.532 | 14.587 | −3.566 | 3.079 | 14.587 | 0.170 | −0.698 | 14.587 |
| 1.904 | −2.454 | 14.587 | −3.582 | 3.115 | 14.587 | 0.352 | −0.885 | 14.587 |
| 1.764 | −2.365 | 14.587 | −3.589 | 3.136 | 14.587 | 0.535 | −1.071 | 14.587 |
| 1.611 | −2.264 | 14.587 | −3.591 | 3.150 | 14.587 | 0.714 | −1.248 | 14.587 |
| 1.445 | −2.149 | 14.587 | −3.590 | 3.157 | 14.587 | 0.890 | −1.416 | 14.587 |
| 1.275 | −2.026 | 14.587 | −3.588 | 3.160 | 14.587 | 1.062 | −1.576 | 14.587 |
| 1.102 | −1.893 | 14.587 | −3.587 | 3.161 | 14.587 | 1.230 | −1.726 | 14.587 |
| 0.924 | −1.750 | 14.587 | −3.585 | 3.162 | 14.587 | 1.395 | −1.868 | 14.587 |
| 0.745 | −1.596 | 14.587 | −3.582 | 3.162 | 14.587 | 1.555 | −2.002 | 14.587 |
| 0.562 | −1.433 | 14.587 | −3.575 | 3.160 | 14.587 | 1.710 | −2.128 | 14.587 |
| 0.377 | −1.260 | 14.587 | −3.563 | 3.152 | 14.587 | 1.853 | −2.241 | 14.587 |
| 0.189 | −1.077 | 14.587 | −3.547 | 3.138 | 14.587 | 1.984 | −2.343 | 14.587 |
| 0.003 | −0.890 | 14.587 | −3.519 | 3.110 | 14.587 | 2.101 | −2.433 | 14.587 |
| −0.180 | −0.702 | 14.587 | −3.485 | 3.071 | 14.587 | 2.204 | −2.512 | 14.587 |
| −0.362 | −0.513 | 14.587 | −3.440 | 3.018 | 14.587 | 2.295 | −2.580 | 14.587 |
| −0.544 | −0.323 | 14.587 | −3.383 | 2.952 | 14.587 | 2.371 | −2.638 | 14.587 |
| −0.724 | −0.132 | 14.587 | −3.308 | 2.868 | 14.587 | 2.436 | −2.687 | 14.587 |
| −0.904 | 0.060 | 14.587 | −3.219 | 2.773 | 14.587 | 2.491 | −2.728 | 14.587 |
| −1.083 | 0.252 | 14.587 | −3.122 | 2.873 | 14.587 | 2.536 | −2.762 | 14.587 |
| −1.262 | 0.444 | 14.587 | −3.012 | 2.561 | 14.587 | 2.572 | −2.789 | 14.587 |
| −1.441 | 0.637 | 14.587 | −2.890 | 2.438 | 14.587 | 2.600 | −2.810 | 14.587 |
| −1.619 | 0.830 | 14.587 | −2.755 | 2.302 | 14.587 | 2.621 | −2.826 | 14.587 |
| −1.796 | 1.024 | 14.587 | −2.613 | 2.161 | 14.587 | 2.838 | −2.839 | 14.587 |
| −1.968 | 1.211 | 14.587 | −2.466 | 2.013 | 14.587 | 2.649 | −2.853 | 14.587 |
| −2.133 | 1.393 | 14.587 | −2.312 | 1.860 | 14.587 | | | |
| −2.291 | 1.568 | 14.587 | −2.153 | 1.699 | 14.587 | | | |
| 2.448 | −2.806 | 16.207 | −2.441 | 2.014 | 16.207 | −1.999 | 1.782 | 16.207 |
| 2.438 | −2.814 | 16.207 | −2.580 | 2.183 | 16.207 | −1.834 | 1.603 | 16.207 |
| 2.421 | −2.810 | 16.207 | −2.713 | 2.346 | 16.207 | −1.664 | 1.417 | 16.207 |
| 2.402 | −2.799 | 16.207 | −2.840 | 2.503 | 16.207 | −1.489 | 1.224 | 16.207 |
| 2.379 | −2.787 | 16.207 | −2.960 | 2.653 | 16.207 | −1.313 | 1.031 | 16.207 |
| 2.348 | −2.770 | 16.207 | −3.069 | 2.791 | 16.207 | −1.139 | 0.837 | 16.207 |
| 2.308 | −2.747 | 16.207 | −3.165 | 2.916 | 16.207 | −0.964 | 0.643 | 16.207 |
| 2.258 | −2.720 | 16.207 | −3.248 | 3.029 | 16.207 | −0.790 | 0.449 | 16.207 |
| 2.198 | −2.685 | 16.207 | −3.324 | 3.137 | 16.207 | −0.616 | 0.255 | 16.207 |
| 2.127 | −2.644 | 16.207 | −3.386 | 3.232 | 16.207 | −0.442 | 0.060 | 16.207 |
| 2.044 | −2.595 | 16.207 | −3.431 | 3.307 | 16.207 | −0.269 | −0.135 | 16.207 |
| 1.946 | −2.536 | 16.207 | −3.465 | 3.369 | 16.207 | −0.096 | −0.330 | 16.207 |
| 1.835 | −2.466 | 16.207 | −3.486 | 3.417 | 16.207 | 0.076 | −0.526 | 16.207 |
| 1.710 | −2.384 | 16.207 | −3.500 | 3.454 | 16.207 | 0.249 | −0.721 | 16.207 |
| 1.573 | −2.291 | 16.207 | −3.505 | 3.475 | 16.207 | 0.422 | −0.916 | 16.207 |
| 1.424 | −2.183 | 16.207 | −3.506 | 3.489 | 16.207 | 0.591 | −1.103 | 16.207 |
| 1.264 | −2.059 | 16.207 | −3.505 | 3.496 | 16.207 | 0.756 | −1.282 | 16.207 |
| 1.101 | −1.926 | 16.207 | −3.503 | 3.499 | 16.207 | 0.918 | −1.452 | 16.207 |
| 0.937 | −1.782 | 16.207 | −3.502 | 3.500 | 16.207 | 1.076 | −1.613 | 16.207 |
| 0.769 | −1.627 | 16.207 | −3.500 | 3.501 | 16.207 | 1.231 | −1.765 | 16.207 |
| 0.599 | −1.462 | 16.207 | −3.497 | 3.500 | 16.207 | 1.384 | −1.908 | 16.207 |
| 0.427 | −1.287 | 16.207 | −3.490 | 3.497 | 16.207 | 1.532 | −2.042 | 16.207 |
| 0.252 | −1.103 | 16.207 | −3.480 | 3.488 | 16.207 | 1.670 | −2.162 | 16.207 |

TABLE 1R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.074 | −0.910 | 16.207 | −3.465 | 3.472 | 16.207 | 1.797 | −2.268 | 16.207 |
| −0.102 | −0.714 | 16.207 | −3.442 | 3.440 | 16.207 | 1.911 | −2.362 | 16.207 |
| −0.277 | −0.518 | 16.207 | −3.412 | 3.397 | 16.207 | 2.013 | −2.444 | 16.207 |
| −0.451 | −0.321 | 16.207 | −3.374 | 3.339 | 16.207 | 2.101 | −2.515 | 16.207 |
| −0.624 | −0.123 | 16.207 | −3.324 | 3.268 | 16.207 | 2.176 | −2.575 | 16.207 |
| −0.797 | 0.075 | 16.207 | −3.255 | 3.177 | 16.207 | 2.240 | −2.626 | 16.207 |
| −0.969 | 0.274 | 16.207 | −3.174 | 3.076 | 16.207 | 2.294 | −2.668 | 16.207 |
| −1.140 | 0.473 | 16.207 | −3.083 | 2.970 | 16.207 | 2.338 | −2.703 | 16.207 |
| −1.312 | 0.673 | 16.207 | −2.980 | 2.853 | 16.207 | 2.374 | −2.730 | 16.207 |
| −1.482 | 0.873 | 16.207 | −2.863 | 2.724 | 16.207 | 2.402 | −2.751 | 16.207 |
| −1.653 | 1.073 | 16.207 | −2.734 | 2.582 | 16.207 | 2.423 | −2.767 | 16.207 |
| −1.823 | 1.274 | 16.207 | −2.599 | 2.435 | 16.207 | 2.440 | −2.780 | 16.207 |
| −1.987 | 1.468 | 16.207 | −2.458 | 2.282 | 16.207 | 2.450 | −2.794 | 16.207 |
| −2.144 | 1.656 | 16.207 | −2.311 | 2.122 | 16.207 | | | |
| −2.296 | 1.838 | 16.207 | −2.158 | 1.955 | 16.207 | | | |
| 2.366 | −2.770 | 17.288 | −2.471 | 2.206 | 17.288 | −2.035 | 1.955 | 17.288 |
| 2.356 | −2.779 | 17.288 | −2.607 | 2.381 | 17.288 | −1.873 | 1.770 | 17.288 |
| 2.339 | −2.774 | 17.288 | −2.737 | 2.549 | 17.288 | −1.706 | 1.577 | 17.288 |
| 2.320 | −2.763 | 17.288 | −2.862 | 2.711 | 17.288 | −1.534 | 1.378 | 17.288 |
| 2.297 | −2.750 | 17.288 | −2.979 | 2.867 | 17.288 | −1.361 | 1.179 | 17.288 |
| 2.266 | −2.733 | 17.288 | −3.085 | 3.010 | 17.288 | −1.189 | 0.979 | 17.288 |
| 2.225 | −2.710 | 17.288 | −3.177 | 3.140 | 17.288 | −1.016 | 0.780 | 17.288 |
| 2.175 | −2.682 | 17.288 | −3.256 | 3.258 | 17.288 | −0.844 | 0.580 | 17.288 |
| 2.114 | −2.647 | 17.288 | −3.326 | 3.371 | 17.288 | −0.673 | 0.379 | 17.288 |
| 2.042 | −2.605 | 17.288 | −3.382 | 3.472 | 17.288 | −0.502 | 0.179 | 17.288 |
| 1.958 | −2.556 | 17.288 | −3.423 | 3.550 | 17.288 | −0.332 | −0.023 | 17.288 |
| 1.860 | −2.495 | 17.288 | −3.452 | 3.615 | 17.288 | −0.162 | −0.224 | 17.288 |
| 1.748 | −2.423 | 17.288 | −3.471 | 3.665 | 17.288 | 0.008 | −0.426 | 17.288 |
| 1.622 | −2.339 | 17.288 | −3.482 | 3.703 | 17.288 | 0.179 | −0.627 | 17.288 |
| 1.484 | −2.243 | 17.288 | −3.486 | 3.725 | 17.288 | 0.350 | −0.827 | 17.288 |
| 1.334 | −2.132 | 17.288 | −3.486 | 3.739 | 17.288 | 0.516 | −1.020 | 17.288 |
| 1.175 | −2.005 | 17.288 | −3.485 | 3.746 | 17.288 | 0.679 | −1.205 | 17.288 |
| 1.013 | −1.867 | 17.288 | −3.483 | 3.749 | 17.288 | 0.838 | −1.381 | 17.288 |
| 0.849 | −1.719 | 17.288 | −3.481 | 3.750 | 17.288 | 0.994 | −1.548 | 17.288 |
| 0.683 | −1.559 | 17.288 | −3.480 | 3.751 | 17.288 | 1.148 | −1.704 | 17.288 |
| 0.516 | −1.388 | 17.288 | −3.476 | 3.750 | 17.288 | 1.299 | −1.851 | 17.288 |
| 0.346 | −1.207 | 17.288 | −3.470 | 3.746 | 17.288 | 1.447 | −1.989 | 17.288 |
| 0.173 | −1.016 | 17.288 | −3.461 | 3.736 | 17.288 | 1.585 | −2.112 | 17.288 |
| −0.003 | −0.817 | 17.288 | −3.447 | 3.718 | 17.288 | 1.711 | −2.221 | 17.288 |
| −0.177 | −0.616 | 17.288 | −3.427 | 3.685 | 17.288 | 1.826 | −2.317 | 17.288 |
| −0.349 | −0.413 | 17.288 | −3.401 | 3.638 | 17.288 | 1.928 | −2.401 | 17.288 |
| −0.520 | −0.209 | 17.288 | −3.368 | 3.576 | 17.288 | 2.016 | −2.473 | 17.288 |
| −0.690 | −0.004 | 17.288 | −3.323 | 3.500 | 17.288 | 2.091 | −2.534 | 17.288 |
| −0.859 | 0.202 | 17.288 | −3.261 | 3.404 | 17.288 | 2.155 | −2.586 | 17.288 |
| −1.027 | 0.408 | 17.288 | −3.185 | 3.296 | 17.288 | 2.209 | −2.630 | 17.288 |
| −1.196 | 0.614 | 17.288 | −3.099 | 3.185 | 17.288 | 2.254 | −2.665 | 17.288 |
| −1.364 | 0.820 | 17.288 | −2.999 | 3.062 | 17.288 | 2.291 | −2.693 | 17.288 |
| −1.531 | 1.027 | 17.288 | −2.885 | 2.928 | 17.288 | 2.319 | −2.714 | 17.288 |
| −1.699 | 1.234 | 17.288 | −2.758 | 2.782 | 17.288 | 2.340 | −2.730 | 17.288 |
| −1.865 | 1.441 | 17.288 | −2.625 | 2.630 | 17.288 | 2.357 | −2.743 | 17.288 |
| −2.026 | 1.642 | 17.288 | −2.487 | 2.471 | 17.288 | 2.368 | −2.757 | 17.288 |
| −2.181 | 1.836 | 17.288 | −2.342 | 2.306 | 17.288 | | | |
| −2.329 | 2.024 | 17.288 | −2.191 | 2.134 | 17.288 | | | |

The coordinate values given in TABLE 2R below provide the nominal profile envelope for an exemplary second stage rotor.

TABLE 2R

| X-LOC | Y-LOC | Z-LOC | X-LOC | Y-LOC | Z-LOC | X-LOC | Y-LOC | Z-LOC |
|---|---|---|---|---|---|---|---|---|
| 3.639 | 0.313 | 0.000 | −1.887 | −0.316 | 0.000 | −1.349 | 0.110 | 0.000 |
| 3.639 | 0.302 | 0.000 | −2.052 | −0.237 | 0.000 | −1.162 | 0.084 | 0.000 |
| 3.632 | 0.290 | 0.000 | −2.204 | −0.155 | 0.000 | −0.968 | 0.066 | 0.000 |
| 3.615 | 0.282 | 0.000 | −2.346 | −0.069 | 0.000 | −0.766 | 0.055 | 0.000 |
| 3.595 | 0.276 | 0.000 | −2.471 | 0.015 | 0.000 | −0.562 | 0.051 | 0.000 |
| 3.567 | 0.267 | 0.000 | −2.581 | 0.096 | 0.000 | −0.358 | 0.053 | 0.000 |
| 3.531 | 0.256 | 0.000 | −2.676 | 0.173 | 0.000 | −0.154 | 0.061 | 0.000 |
| 3.486 | 0.242 | 0.000 | −2.758 | 0.244 | 0.000 | 0.050 | 0.072 | 0.000 |
| 3.432 | 0.225 | 0.000 | −2.827 | 0.309 | 0.000 | 0.253 | 0.084 | 0.000 |
| 3.367 | 0.206 | 0.000 | −2.884 | 0.366 | 0.000 | 0.457 | 0.097 | 0.000 |
| 3.290 | 0.183 | 0.000 | −2.931 | 0.416 | 0.000 | 0.661 | 0.110 | 0.000 |

TABLE 2R-continued

| X-LOC | Y-LOC | Z-LOC | X-LOC | Y-LOC | Z-LOC | X-LOC | Y-LOC | Z-LOC |
|---|---|---|---|---|---|---|---|---|
| 3.201 | 0.155 | 0.000 | −2.969 | 0.459 | 0.000 | 0.865 | 0.122 | 0.000 |
| 3.097 | 0.124 | 0.000 | −3.000 | 0.496 | 0.000 | 1.069 | 0.135 | 0.000 |
| 2.979 | 0.088 | 0.000 | −3.023 | 0.526 | 0.000 | 1.273 | 0.148 | 0.000 |
| 2.847 | 0.049 | 0.000 | −3.040 | 0.550 | 0.000 | 1.476 | 0.161 | 0.000 |
| 2.702 | 0.006 | 0.000 | −3.050 | 0.570 | 0.000 | 1.673 | 0.174 | 0.000 |
| 2.542 | −0.042 | 0.000 | −3.057 | 0.587 | 0.000 | 1.864 | 0.186 | 0.000 |
| 2.376 | −0.091 | 0.000 | −3.059 | 0.601 | 0.000 | 2.047 | 0.198 | 0.000 |
| 2.203 | −0.142 | 0.000 | −3.055 | 0.612 | 0.000 | 2.224 | 0.211 | 0.000 |
| 2.022 | −0.195 | 0.000 | −3.047 | 0.618 | 0.000 | 2.393 | 0.223 | 0.000 |
| 1.834 | −0.248 | 0.000 | −3.034 | 0.620 | 0.000 | 2.556 | 0.235 | 0.000 |
| 1.639 | −0.301 | 0.000 | −3.016 | 0.620 | 0.000 | 2.712 | 0.248 | 0.000 |
| 1.436 | −0.355 | 0.000 | −2.996 | 0.616 | 0.000 | 2.855 | 0.261 | 0.000 |
| 1.226 | −0.407 | 0.000 | −2.970 | 0.609 | 0.000 | 2.984 | 0.272 | 0.000 |
| 1.014 | −0.456 | 0.000 | −2.936 | 0.598 | 0.000 | 3.099 | 0.283 | 0.000 |
| 0.802 | −0.501 | 0.000 | −2.895 | 0.582 | 0.000 | 3.201 | 0.292 | 0.000 |
| 0.589 | −0.542 | 0.000 | −2.845 | 0.563 | 0.000 | 3.289 | 0.301 | 0.000 |
| 0.376 | −0.576 | 0.000 | −2.785 | 0.540 | 0.000 | 3.363 | 0.308 | 0.000 |
| 0.162 | −0.603 | 0.000 | −2.715 | 0.512 | 0.000 | 3.427 | 0.314 | 0.000 |
| −0.053 | −0.622 | 0.000 | −2.632 | 0.480 | 0.000 | 3.480 | 0.320 | 0.000 |
| −0.268 | −0.631 | 0.000 | −2.537 | 0.443 | 0.000 | 3.524 | 0.324 | 0.000 |
| −0.485 | −0.630 | 0.000 | −2.429 | 0.402 | 0.000 | 3.560 | 0.328 | 0.000 |
| −0.702 | −0.618 | 0.000 | −2.307 | 0.357 | 0.000 | 3.587 | 0.331 | 0.000 |
| −0.919 | −0.594 | 0.000 | −2.172 | 0.311 | 0.000 | 3.607 | 0.333 | 0.000 |
| −1.132 | −0.557 | 0.000 | −2.022 | 0.264 | 0.000 | 3.624 | 0.331 | 0.000 |
| −1.336 | −0.510 | 0.000 | −1.865 | 0.219 | 0.000 | 3.635 | 0.323 | 0.000 |
| −1.529 | −0.454 | 0.000 | −1.700 | 0.178 | 0.000 | | | |
| −1.713 | −0.389 | 0.000 | −1.528 | 0.141 | 0.000 | | | |
| 3.615 | −0.082 | 1.313 | −1.888 | 0.047 | 1.313 | −1.361 | 0.406 | 1.313 |
| 3.614 | −0.093 | 1.313 | −2.044 | 0.132 | 1.313 | −1.177 | 0.356 | 1.313 |
| 3.606 | −0.104 | 1.313 | −2.192 | 0.219 | 1.313 | −0.985 | 0.308 | 1.313 |
| 3.589 | −0.110 | 1.313 | −2.330 | 0.306 | 1.313 | −0.786 | 0.262 | 1.313 |
| 3.568 | −0.115 | 1.313 | −2.455 | 0.391 | 1.313 | −0.585 | 0.221 | 1.313 |
| 3.540 | −0.121 | 1.313 | −2.565 | 0.471 | 1.313 | −0.384 | 0.183 | 1.313 |
| 3.504 | −0.130 | 1.313 | −2.662 | 0.546 | 1.313 | −0.182 | 0.149 | 1.313 |
| 3.458 | −0.140 | 1.313 | −2.746 | 0.615 | 1.313 | 0.020 | 0.118 | 1.313 |
| 3.403 | −0.152 | 1.313 | −2.817 | 0.677 | 1.313 | 0.222 | 0.089 | 1.313 |
| 3.337 | −0.166 | 1.313 | −2.875 | 0.731 | 1.313 | 0.425 | 0.064 | 1.313 |
| 3.259 | −0.183 | 1.313 | −2.924 | 0.778 | 1.313 | 0.628 | 0.040 | 1.313 |
| 3.168 | −0.202 | 1.313 | −2.965 | 0.818 | 1.313 | 0.831 | 0.019 | 1.313 |
| 3.063 | −0.225 | 1.313 | −2.997 | 0.853 | 1.313 | 1.035 | 0.001 | 1.313 |
| 2.943 | −0.249 | 1.313 | −3.021 | 0.881 | 1.313 | 1.239 | −0.015 | 1.313 |
| 2.809 | −0.276 | 1.313 | −3.039 | 0.904 | 1.313 | 1.443 | −0.028 | 1.313 |
| 2.661 | −0.304 | 1.313 | −3.050 | 0.923 | 1.313 | 1.640 | −0.040 | 1.313 |
| 2.498 | −0.335 | 1.313 | −3.058 | 0.939 | 1.313 | 1.831 | −0.049 | 1.313 |
| 2.329 | −0.367 | 1.313 | −3.061 | 0.953 | 1.313 | 2.015 | −0.056 | 1.313 |
| 2.152 | −0.399 | 1.313 | −3.058 | 0.964 | 1.313 | 2.193 | −0.062 | 1.313 |
| 1.968 | −0.431 | 1.313 | −3.050 | 0.970 | 1.313 | 2.363 | −0.066 | 1.313 |
| 1.777 | −0.462 | 1.313 | −3.037 | 0.973 | 1.313 | 2.527 | −0.069 | 1.313 |
| 1.577 | −0.490 | 1.313 | −3.020 | 0.972 | 1.313 | 2.684 | −0.071 | 1.313 |
| 1.371 | −0.516 | 1.313 | −3.000 | 0.969 | 1.313 | 2.827 | −0.072 | 1.313 |
| 1.156 | −0.537 | 1.313 | −2.973 | 0.962 | 1.313 | 2.957 | −0.071 | 1.313 |
| 0.940 | −0.552 | 1.313 | −2.939 | 0.952 | 1.313 | 3.073 | −0.071 | 1.313 |
| 0.725 | −0.561 | 1.313 | −2.897 | 0.938 | 1.313 | 3.175 | −0.070 | 1.313 |
| 0.511 | −0.561 | 1.313 | −2.846 | 0.920 | 1.313 | 3.264 | −0.069 | 1.313 |
| 0.297 | −0.554 | 1.313 | −2.786 | 0.897 | 1.313 | 3.339 | −0.068 | 1.313 |
| 0.085 | −0.538 | 1.313 | −2.716 | 0.871 | 1.313 | 3.403 | −0.066 | 1.313 |
| −0.127 | −0.513 | 1.313 | −2.633 | 0.840 | 1.313 | 3.457 | −0.065 | 1.313 |
| −0.337 | −0.480 | 1.313 | −2.537 | 0.804 | 1.313 | 3.502 | −0.064 | 1.313 |
| −0.547 | −0.439 | 1.313 | −2.428 | 0.763 | 1.313 | 3.537 | −0.063 | 1.313 |
| −0.755 | −0.389 | 1.313 | −2.307 | 0.718 | 1.313 | 3.564 | −0.062 | 1.313 |
| −0.963 | −0.330 | 1.313 | −2.172 | 0.668 | 1.313 | 3.585 | −0.062 | 1.313 |
| −1.168 | −0.264 | 1.313 | −2.024 | 0.616 | 1.313 | 3.602 | −0.063 | 1.313 |
| −1.363 | −0.192 | 1.313 | −1.869 | 0.563 | 1.313 | 3.612 | −0.072 | 1.313 |
| −1.548 | −0.115 | 1.313 | −1.707 | 0.510 | 1.313 | | | |
| −1.723 | −0.036 | 1.313 | −1.538 | 0.457 | 1.313 | | | |
| 3.583 | −0.478 | 2.625 | −1.874 | 0.247 | 2.625 | −1.344 | 0.555 | 2.625 |
| 3.581 | −0.488 | 2.625 | −2.026 | 0.337 | 2.625 | −1.162 | 0.494 | 2.625 |
| 3.571 | −0.498 | 2.625 | −2.171 | 0.427 | 2.625 | −0.973 | 0.432 | 2.625 |
| 3.554 | −0.502 | 2.625 | −2.307 | 0.517 | 2.625 | −0.777 | 0.371 | 2.625 |
| 3.532 | −0.504 | 2.625 | −2.429 | 0.602 | 2.625 | −0.580 | 0.311 | 2.625 |
| 3.504 | −0.507 | 2.625 | −2.538 | 0.683 | 2.625 | −0.382 | 0.254 | 2.625 |
| 3.467 | −0.511 | 2.625 | −2.634 | 0.758 | 2.625 | −0.184 | 0.199 | 2.625 |
| 3.421 | −0.516 | 2.625 | −2.717 | 0.826 | 2.625 | 0.015 | 0.145 | 2.625 |
| 3.364 | −0.522 | 2.625 | −2.788 | 0.888 | 2.625 | 0.214 | 0.093 | 2.625 |
| 3.297 | −0.528 | 2.625 | −2.846 | 0.941 | 2.625 | 0.413 | 0.043 | 2.625 |
| 3.219 | −0.536 | 2.625 | −2.895 | 0.988 | 2.625 | 0.613 | −0.006 | 2.625 |
| 3.127 | −0.545 | 2.625 | −2.936 | 1.028 | 2.625 | 0.813 | −0.052 | 2.625 |

TABLE 2R-continued

| X-LOC | Y-LOC | Z-LOC | X-LOC | Y-LOC | Z-LOC | X-LOC | Y-LOC | Z-LOC |
|---|---|---|---|---|---|---|---|---|
| 3.020 | −0.555 | 2.625 | −2.969 | 1.061 | 2.625 | 1.014 | −0.097 | 2.625 |
| 2.899 | −0.566 | 2.625 | −2.994 | 1.089 | 2.625 | 1.216 | −0.139 | 2.625 |
| 2.763 | −0.577 | 2.625 | −3.011 | 1.112 | 2.625 | 1.418 | −0.178 | 2.625 |
| 2.614 | −0.589 | 2.625 | −3.023 | 1.130 | 2.625 | 1.614 | −0.213 | 2.625 |
| 2.450 | −0.601 | 2.625 | −3.031 | 1.147 | 2.625 | 1.803 | −0.245 | 2.625 |
| 2.279 | −0.614 | 2.625 | −3.034 | 1.161 | 2.625 | 1.986 | −0.274 | 2.625 |
| 2.100 | −0.625 | 2.625 | −3.031 | 1.171 | 2.625 | 2.163 | −0.300 | 2.625 |
| 1.915 | −0.634 | 2.625 | −3.023 | 1.177 | 2.625 | 2.333 | −0.323 | 2.625 |
| 1.722 | −0.641 | 2.625 | −3.010 | 1.180 | 2.625 | 2.496 | −0.344 | 2.625 |
| 1.522 | −0.645 | 2.625 | −2.992 | 1.179 | 2.625 | 2.653 | −0.363 | 2.625 |
| 1.315 | −0.643 | 2.625 | −2.972 | 1.176 | 2.625 | 2.796 | −0.379 | 2.625 |
| 1.100 | −0.636 | 2.625 | −2.945 | 1.169 | 2.625 | 2.926 | −0.393 | 2.625 |
| 0.885 | −0.623 | 2.625 | −2.911 | 1.158 | 2.625 | 3.042 | −0.406 | 2.625 |
| 0.672 | −0.602 | 2.625 | −2.869 | 1.143 | 2.625 | 3.144 | −0.417 | 2.625 |
| 0.461 | −0.575 | 2.625 | −2.819 | 1.124 | 2.625 | 3.233 | −0.425 | 2.625 |
| 0.250 | −0.540 | 2.625 | −2.759 | 1.100 | 2.625 | 3.308 | −0.432 | 2.625 |
| 0.042 | −0.497 | 2.625 | −2.688 | 1.073 | 2.625 | 3.373 | −0.438 | 2.625 |
| −0.165 | −0.447 | 2.625 | −2.605 | 1.040 | 2.625 | 3.427 | −0.443 | 2.625 |
| −0.370 | −0.390 | 2.625 | −2.510 | 1.002 | 2.625 | 3.471 | −0.447 | 2.625 |
| −0.574 | −0.327 | 2.625 | −2.402 | 0.958 | 2.625 | 3.507 | −0.450 | 2.625 |
| −0.777 | −0.257 | 2.625 | −2.281 | 0.909 | 2.625 | 3.534 | −0.453 | 2.625 |
| −0.978 | −0.181 | 2.625 | −2.147 | 0.855 | 2.625 | 3.555 | −0.455 | 2.625 |
| −1.175 | −0.100 | 2.625 | −2.000 | 0.797 | 2.625 | 3.571 | −0.458 | 2.625 |
| −1.364 | −0.016 | 2.625 | −1.847 | 0.738 | 2.625 | 3.581 | −0.468 | 2.625 |
| −1.543 | 0.071 | 2.625 | −1.686 | 0.678 | 2.625 | | | |
| −1.713 | 0.158 | 2.625 | −1.518 | 0.617 | 2.625 | | | |
| 3.561 | −0.707 | 3.501 | −1.857 | 0.313 | 3.501 | −1.330 | 0.587 | 3.501 |
| 3.558 | −0.717 | 3.501 | −2.009 | 0.407 | 3.501 | −1.150 | 0.518 | 3.501 |
| 3.548 | −0.726 | 3.501 | −2.153 | 0.501 | 3.501 | −0.963 | 0.449 | 3.501 |
| 3.530 | −0.728 | 3.501 | −2.288 | 0.595 | 3.501 | −0.768 | 0.380 | 3.501 |
| 3.509 | −0.729 | 3.501 | −2.410 | 0.682 | 3.501 | −0.573 | 0.313 | 3.501 |
| 3.480 | −0.730 | 3.501 | −2.518 | 0.764 | 3.501 | −0.376 | 0.248 | 3.501 |
| 3.443 | −0.731 | 3.501 | −2.613 | 0.840 | 3.501 | −0.179 | 0.185 | 3.501 |
| 3.397 | −0.732 | 3.501 | −2.695 | 0.909 | 3.501 | 0.018 | 0.124 | 3.501 |
| 3.340 | −0.733 | 3.501 | −2.765 | 0.971 | 3.501 | 0.216 | 0.065 | 3.501 |
| 3.273 | −0.735 | 3.501 | −2.823 | 1.024 | 3.501 | 0.414 | 0.007 | 3.501 |
| 3.195 | −0.736 | 3.501 | −2.872 | 1.070 | 3.501 | 0.613 | −0.050 | 3.501 |
| 3.102 | −0.739 | 3.501 | −2.912 | 1.109 | 3.501 | 0.812 | −0.106 | 3.501 |
| 2.995 | −0.741 | 3.501 | −2.945 | 1.143 | 3.501 | 1.011 | −0.160 | 3.501 |
| 2.873 | −0.743 | 3.501 | −2.969 | 1.171 | 3.501 | 1.211 | −0.213 | 3.501 |
| 2.738 | −0.744 | 3.501 | −2.987 | 1.193 | 3.501 | 1.411 | −0.263 | 3.501 |
| 2.588 | −0.745 | 3.501 | −2.999 | 1.211 | 3.501 | 1.606 | −0.311 | 3.501 |
| 2.424 | −0.746 | 3.501 | −3.006 | 1.227 | 3.501 | 1.794 | −0.354 | 3.501 |
| 2.252 | −0.746 | 3.501 | −3.009 | 1.241 | 3.501 | 1.975 | −0.395 | 3.501 |
| 2.074 | −0.744 | 3.501 | −3.006 | 1.252 | 3.501 | 2.150 | −0.432 | 3.501 |
| 1.889 | −0.741 | 3.501 | −2.998 | 1.258 | 3.501 | 2.319 | −0.467 | 3.501 |
| 1.696 | −0.734 | 3.501 | −2.985 | 1.260 | 3.501 | 2.481 | −0.499 | 3.501 |
| 1.497 | −0.724 | 3.501 | −2.967 | 1.259 | 3.501 | 2.637 | −0.528 | 3.501 |
| 1.290 | −0.709 | 3.501 | −2.947 | 1.255 | 3.501 | 2.780 | −0.554 | 3.501 |
| 1.077 | −0.688 | 3.501 | −2.920 | 1.248 | 3.501 | 2.909 | −0.576 | 3.501 |
| 0.864 | −0.662 | 3.501 | −2.886 | 1.236 | 3.501 | 3.024 | −0.596 | 3.501 |
| 0.653 | −0.630 | 3.501 | −2.845 | 1.220 | 3.501 | 3.126 | −0.614 | 3.501 |
| 0.444 | −0.592 | 3.501 | −2.794 | 1.199 | 3.501 | 3.214 | −0.629 | 3.501 |
| 0.236 | −0.547 | 3.501 | −2.735 | 1.174 | 3.501 | 3.289 | −0.642 | 3.501 |
| 0.031 | −0.496 | 3.501 | −2.665 | 1.145 | 3.501 | 3.353 | −0.652 | 3.501 |
| −0.172 | −0.438 | 3.501 | −2.582 | 1.110 | 3.501 | 3.407 | −0.661 | 3.501 |
| −0.374 | −0.373 | 3.501 | −2.487 | 1.070 | 3.501 | 3.451 | −0.668 | 3.501 |
| −0.574 | −0.303 | 3.501 | −2.380 | 1.023 | 3.501 | 3.486 | −0.674 | 3.501 |
| −0.773 | −0.227 | 3.501 | −2.260 | 0.971 | 3.501 | 3.514 | −0.678 | 3.501 |
| −0.969 | −0.145 | 3.501 | −2.127 | 0.913 | 3.501 | 3.534 | −0.682 | 3.501 |
| −1.164 | −0.057 | 3.501 | −1.981 | 0.851 | 3.501 | 3.551 | −0.686 | 3.501 |
| −1.351 | 0.034 | 3.501 | −1.829 | 0.787 | 3.501 | 3.559 | −0.697 | 3.501 |
| −1.528 | 0.126 | 3.501 | −1.669 | 0.721 | 3.501 | | | |
| −1.697 | 0.219 | 3.501 | −1.503 | 0.654 | 3.501 | | | |
| 3.501 | −1.190 | 5.251 | −1.812 | 0.413 | 5.251 | −1.293 | 0.600 | 5.251 |
| 3.497 | −1.199 | 5.251 | −1.959 | 0.516 | 5.251 | −1.117 | 0.517 | 5.251 |
| 3.485 | −1.207 | 5.251 | −2.098 | 0.617 | 5.251 | −0.933 | 0.433 | 5.251 |
| 3.467 | −1.206 | 5.251 | −2.230 | 0.716 | 5.251 | −0.743 | 0.347 | 5.251 |
| 3.446 | −1.204 | 5.251 | −2.348 | 0.809 | 5.251 | −0.552 | 0.263 | 5.251 |
| 3.417 | −1.201 | 5.251 | −2.453 | 0.895 | 5.251 | −0.360 | 0.180 | 5.251 |
| 3.380 | −1.197 | 5.251 | −2.546 | 0.974 | 5.251 | −0.168 | 0.100 | 5.251 |
| 3.334 | −1.191 | 5.251 | −2.627 | 1.045 | 5.251 | 0.025 | 0.021 | 5.251 |
| 3.278 | −1.185 | 5.251 | −2.695 | 1.108 | 5.251 | 0.219 | −0.057 | 5.251 |
| 3.211 | −1.177 | 5.251 | −2.752 | 1.162 | 5.251 | 0.414 | −0.133 | 5.251 |
| 3.133 | −1.168 | 5.251 | −2.800 | 1.209 | 5.251 | 0.609 | −0.208 | 5.251 |
| 3.040 | −1.158 | 5.251 | −2.841 | 1.249 | 5.251 | 0.804 | −0.283 | 5.251 |
| 2.934 | −1.145 | 5.251 | −2.873 | 1.282 | 5.251 | 1.000 | −0.356 | 5.251 |

TABLE 2R-continued

| X-LOC | Y-LOC | Z-LOC | X-LOC | Y-LOC | Z-LOC | X-LOC | Y-LOC | Z-LOC |
|---|---|---|---|---|---|---|---|---|
| 2.813 | −1.131 | 5.251 | −2.898 | 1.310 | 5.251 | 1.196 | −0.428 | 5.251 |
| 2.678 | −1.114 | 5.251 | −2.916 | 1.333 | 5.251 | 1.392 | −0.500 | 5.251 |
| 2.529 | −1.095 | 5.251 | −2.927 | 1.351 | 5.251 | 1.582 | −0.567 | 5.251 |
| 2.365 | −1.075 | 5.251 | −2.935 | 1.367 | 5.251 | 1.767 | −0.631 | 5.251 |
| 2.195 | −1.052 | 5.251 | −2.939 | 1.381 | 5.251 | 1.945 | −0.692 | 5.251 |
| 2.018 | −1.028 | 5.251 | −2.936 | 1.391 | 5.251 | 2.117 | −0.749 | 5.251 |
| 1.833 | −1.001 | 5.251 | −2.927 | 1.396 | 5.251 | 2.282 | −0.803 | 5.251 |
| 1.643 | −0.970 | 5.251 | −2.913 | 1.397 | 5.251 | 2.442 | −0.853 | 5.251 |
| 1.445 | −0.935 | 5.251 | −2.896 | 1.395 | 5.251 | 2.595 | −0.901 | 5.251 |
| 1.242 | −0.895 | 5.251 | −2.876 | 1.389 | 5.251 | 2.735 | −0.943 | 5.251 |
| 1.031 | −0.849 | 5.251 | −2.849 | 1.379 | 5.251 | 2.862 | −0.981 | 5.251 |
| 0.823 | −0.799 | 5.251 | −2.816 | 1.365 | 5.251 | 2.975 | −1.014 | 5.251 |
| 0.616 | −0.744 | 5.251 | −2.775 | 1.345 | 5.251 | 3.075 | −1.044 | 5.251 |
| 0.412 | −0.683 | 5.251 | −2.726 | 1.321 | 5.251 | 3.162 | −1.070 | 5.251 |
| 0.210 | −0.617 | 5.251 | −2.668 | 1.292 | 5.251 | 3.236 | −1.091 | 5.251 |
| 0.010 | −0.545 | 5.251 | −2.599 | 1.257 | 5.251 | 3.299 | −1.109 | 5.251 |
| −0.187 | −0.467 | 5.251 | −2.518 | 1.217 | 5.251 | 3.351 | −1.125 | 5.251 |
| −0.382 | −0.383 | 5.251 | −2.425 | 1.170 | 5.251 | 3.395 | −1.137 | 5.251 |
| −0.575 | −0.295 | 5.251 | −2.319 | 1.116 | 5.251 | 3.430 | −1.148 | 5.251 |
| −0.767 | −0.202 | 5.251 | −2.202 | 1.055 | 5.251 | 3.456 | −1.155 | 5.251 |
| −0.956 | −0.104 | 5.251 | −2.072 | 0.987 | 5.251 | 3.476 | −1.161 | 5.251 |
| −1.143 | −0.001 | 5.251 | −1.929 | 0.914 | 5.251 | 3.493 | −1.168 | 5.251 |
| −1.323 | 0.102 | 5.251 | −1.780 | 0.839 | 5.251 | 3.501 | −1.179 | 5.251 |
| −1.494 | 0.206 | 5.251 | −1.624 | 0.762 | 5.251 | | | |
| −1.657 | 0.310 | 5.251 | −1.462 | 0.682 | 5.251 | | | |
| 3.436 | −1.657 | 7.001 | −1.753 | 0.441 | 7.001 | −1.248 | 0.552 | 7.001 |
| 3.431 | −1.666 | 7.001 | −1.896 | 0.550 | 7.001 | −1.076 | 0.457 | 7.001 |
| 3.418 | −1.672 | 7.001 | −2.032 | 0.657 | 7.001 | −0.896 | 0.359 | 7.001 |
| 3.400 | −1.669 | 7.001 | −2.160 | 0.762 | 7.001 | −0.710 | 0.259 | 7.001 |
| 3.379 | −1.664 | 7.001 | −2.276 | 0.859 | 7.001 | −0.523 | 0.161 | 7.001 |
| 3.351 | −1.657 | 7.001 | −2.379 | 0.949 | 7.001 | −0.335 | 0.064 | 7.001 |
| 3.314 | −1.649 | 7.001 | −2.470 | 1.030 | 7.001 | −0.147 | −0.031 | 7.001 |
| 3.269 | −1.638 | 7.001 | −2.549 | 1.104 | 7.001 | 0.043 | −0.125 | 7.001 |
| 3.214 | −1.625 | 7.001 | −2.616 | 1.169 | 7.001 | 0.233 | −0.217 | 7.001 |
| 3.148 | −1.609 | 7.001 | −2.673 | 1.224 | 7.001 | 0.423 | −0.309 | 7.001 |
| 3.071 | −1.591 | 7.001 | −2.721 | 1.272 | 7.001 | 0.614 | −0.400 | 7.001 |
| 2.980 | −1.569 | 7.001 | −2.761 | 1.313 | 7.001 | 0.805 | −0.491 | 7.001 |
| 2.874 | −1.544 | 7.001 | −2.793 | 1.347 | 7.001 | 0.996 | −0.581 | 7.001 |
| 2.755 | −1.516 | 7.001 | −2.818 | 1.375 | 7.001 | 1.187 | −0.670 | 7.001 |
| 2.622 | −1.483 | 7.001 | −2.835 | 1.397 | 7.001 | 1.379 | −0.759 | 7.001 |
| 2.475 | −1.448 | 7.001 | −2.847 | 1.415 | 7.001 | 1.565 | −0.844 | 7.001 |
| 2.314 | −1.409 | 7.001 | −2.856 | 1.431 | 7.001 | 1.745 | −0.925 | 7.001 |
| 2.147 | −1.367 | 7.001 | −2.859 | 1.445 | 7.001 | 1.919 | −1.002 | 7.001 |
| 1.972 | −1.323 | 7.001 | −2.857 | 1.455 | 7.001 | 2.086 | −1.076 | 7.001 |
| 1.791 | −1.275 | 7.001 | −2.847 | 1.460 | 7.001 | 2.248 | −1.146 | 7.001 |
| 1.604 | −1.223 | 7.001 | −2.833 | 1.460 | 7.001 | 2.404 | −1.212 | 7.001 |
| 1.410 | −1.167 | 7.001 | −2.816 | 1.456 | 7.001 | 2.553 | −1.275 | 7.001 |
| 1.211 | −1.106 | 7.001 | −2.796 | 1.448 | 7.001 | 2.690 | −1.331 | 7.001 |
| 1.005 | −1.038 | 7.001 | −2.770 | 1.436 | 7.001 | 2.814 | −1.382 | 7.001 |
| 0.802 | −0.967 | 7.001 | −2.738 | 1.419 | 7.001 | 2.925 | −1.427 | 7.001 |
| 0.601 | −0.892 | 7.001 | −2.698 | 1.396 | 7.001 | 3.022 | −1.467 | 7.001 |
| 0.402 | −0.812 | 7.001 | −2.650 | 1.368 | 7.001 | 3.107 | −1.502 | 7.001 |
| 0.205 | −0.727 | 7.001 | −2.593 | 1.335 | 7.001 | 3.179 | −1.531 | 7.001 |
| 0.012 | −0.637 | 7.001 | −2.526 | 1.296 | 7.001 | 3.240 | −1.556 | 7.001 |
| −0.180 | −0.543 | 7.001 | −2.447 | 1.250 | 7.001 | 3.292 | −1.577 | 7.001 |
| −0.369 | −0.445 | 7.001 | −2.356 | 1.196 | 7.001 | 3.334 | −1.594 | 7.001 |
| −0.556 | −0.342 | 7.001 | −2.253 | 1.135 | 7.001 | 3.368 | −1.608 | 7.001 |
| −0.742 | −0.235 | 7.001 | −2.138 | 1.067 | 7.001 | 3.394 | −1.618 | 7.001 |
| −0.925 | −0.125 | 7.001 | −2.011 | 0.992 | 7.001 | 3.414 | −1.626 | 7.001 |
| −1.106 | −0.010 | 7.001 | −1.871 | 0.909 | 7.001 | 3.430 | −1.634 | 7.001 |
| −1.279 | 0.104 | 7.001 | −1.725 | 0.824 | 7.001 | 3.436 | −1.646 | 7.001 |
| −1.445 | 0.217 | 7.001 | −1.573 | 0.736 | 7.001 | | | |
| −1.603 | 0.330 | 7.001 | −1.414 | 0.646 | 7.001 | | | |
| 3.373 | −2.120 | 8.751 | −1.670 | 0.420 | 8.751 | −1.192 | 0.456 | 8.751 |
| 3.367 | −2.128 | 8.751 | −1.810 | 0.536 | 8.751 | −1.024 | 0.348 | 8.751 |
| 3.353 | −2.132 | 8.751 | −1.943 | 0.649 | 8.751 | −0.850 | 0.238 | 8.751 |
| 3.336 | −2.127 | 8.751 | −2.069 | 0.759 | 8.751 | −0.668 | 0.125 | 8.751 |
| 3.315 | −2.119 | 8.751 | −2.182 | 0.861 | 8.751 | −0.486 | 0.013 | 8.751 |
| 3.288 | −2.109 | 8.751 | −2.284 | 0.955 | 8.751 | −0.302 | −0.097 | 8.751 |
| 3.252 | −2.096 | 8.751 | −2.373 | 1.040 | 8.751 | −0.119 | −0.206 | 8.751 |
| 3.208 | −2.080 | 8.751 | −2.451 | 1.116 | 8.751 | 0.066 | −0.314 | 8.751 |
| 3.154 | −2.061 | 8.751 | −2.518 | 1.183 | 8.751 | 0.251 | −0.421 | 8.751 |
| 3.090 | −2.037 | 8.751 | −2.574 | 1.240 | 8.751 | 0.437 | −0.527 | 8.751 |
| 3.015 | −2.010 | 8.751 | −2.621 | 1.290 | 8.751 | 0.623 | −0.632 | 8.751 |
| 2.927 | −1.978 | 8.751 | −2.661 | 1.331 | 8.751 | 0.810 | −0.736 | 8.751 |
| 2.824 | −1.941 | 8.751 | −2.693 | 1.366 | 8.751 | 0.997 | −0.841 | 8.751 |
| 2.708 | −1.899 | 8.751 | −2.718 | 1.394 | 8.751 | 1.184 | −0.944 | 8.751 |

TABLE 2R-continued

| X-LOC | Y-LOC | Z-LOC | X-LOC | Y-LOC | Z-LOC | X-LOC | Y-LOC | Z-LOC |
|---|---|---|---|---|---|---|---|---|
| 2.579 | −1.852 | 8.751 | −2.735 | 1.417 | 8.751 | 1.371 | −1.047 | 8.751 |
| 2.435 | −1.800 | 8.751 | −2.747 | 1.436 | 8.751 | 1.552 | −1.146 | 8.751 |
| 2.278 | −1.744 | 8.751 | −2.756 | 1.452 | 8.751 | 1.728 | −1.241 | 8.751 |
| 2.115 | −1.684 | 8.751 | −2.759 | 1.466 | 8.751 | 1.897 | −1.333 | 8.751 |
| 1.945 | −1.621 | 8.751 | −2.757 | 1.476 | 8.751 | 2.061 | −1.420 | 8.751 |
| 1.768 | −1.555 | 8.751 | −2.747 | 1.480 | 8.751 | 2.218 | −1.503 | 8.751 |
| 1.586 | −1.485 | 8.751 | −2.733 | 1.478 | 8.751 | 2.370 | −1.583 | 8.751 |
| 1.398 | −1.410 | 8.751 | −2.716 | 1.472 | 8.751 | 2.515 | −1.658 | 8.751 |
| 1.204 | −1.330 | 8.751 | −2.696 | 1.463 | 8.751 | 2.648 | −1.727 | 8.751 |
| 1.006 | −1.244 | 8.751 | −2.672 | 1.449 | 8.751 | 2.769 | −1.789 | 8.751 |
| 0.809 | −1.155 | 8.751 | −2.640 | 1.430 | 8.751 | 2.877 | −1.844 | 8.751 |
| 0.615 | −1.062 | 8.751 | −2.602 | 1.404 | 8.751 | 2.972 | −1.892 | 8.751 |
| 0.423 | −0.966 | 8.751 | −2.555 | 1.372 | 8.751 | 3.055 | −1.935 | 8.751 |
| 0.233 | −0.865 | 8.751 | −2.500 | 1.334 | 8.751 | 3.124 | −1.970 | 8.751 |
| 0.045 | −0.761 | 8.751 | −2.435 | 1.290 | 8.751 | 3.184 | −2.001 | 8.751 |
| −0.140 | −0.653 | 8.751 | −2.359 | 1.238 | 8.751 | 3.234 | −2.026 | 8.751 |
| −0.324 | −0.541 | 8.751 | −2.270 | 1.178 | 8.751 | 3.276 | −2.048 | 8.751 |
| −0.506 | −0.426 | 8.751 | −2.170 | 1.109 | 8.751 | 3.309 | −2.064 | 8.751 |
| −0.685 | −0.308 | 8.751 | −2.059 | 1.033 | 8.751 | 3.334 | −2.077 | 8.751 |
| −0.863 | −0.187 | 8.751 | −1.935 | 0.948 | 8.751 | 3.353 | −2.087 | 8.751 |
| −1.039 | −0.063 | 8.751 | −1.799 | 0.856 | 8.751 | 3.368 | −2.096 | 8.751 |
| −1.208 | 0.061 | 8.751 | −1.657 | 0.761 | 8.751 | 3.374 | −2.109 | 8.751 |
| −1.369 | 0.182 | 8.751 | −1.509 | 0.662 | 8.751 | | | |
| −1.523 | 0.302 | 8.751 | −1.354 | 0.560 | 8.751 | | | |
| 3.292 | −2.535 | 10.502 | −1.580 | 0.410 | 10.502 | −1.138 | 0.353 | 10.502 |
| 3.285 | −2.543 | 10.502 | −1.715 | 0.530 | 10.502 | −0.975 | 0.234 | 10.502 |
| 3.270 | −2.545 | 10.502 | −1.844 | 0.647 | 10.502 | −0.807 | 0.111 | 10.502 |
| 3.254 | −2.538 | 10.502 | −1.967 | 0.761 | 10.502 | −0.631 | −0.014 | 10.502 |
| 3.234 | −2.528 | 10.502 | −2.077 | 0.865 | 10.502 | −0.455 | −0.138 | 10.502 |
| 3.208 | −2.516 | 10.502 | −2.176 | 0.961 | 10.502 | −0.278 | −0.261 | 10.502 |
| 3.174 | −2.499 | 10.502 | −2.264 | 1.048 | 10.502 | −0.100 | −0.383 | 10.502 |
| 3.132 | −2.479 | 10.502 | −2.341 | 1.125 | 10.502 | 0.079 | −0.504 | 10.502 |
| 3.080 | −2.454 | 10.502 | −2.407 | 1.193 | 10.502 | 0.259 | −0.623 | 10.502 |
| 3.019 | −2.424 | 10.502 | −2.462 | 1.250 | 10.502 | 0.439 | −0.741 | 10.502 |
| 2.947 | −2.390 | 10.502 | −2.508 | 1.300 | 10.502 | 0.620 | −0.859 | 10.502 |
| 2.862 | −2.349 | 10.502 | −2.547 | 1.342 | 10.502 | 0.801 | −0.976 | 10.502 |
| 2.764 | −2.303 | 10.502 | −2.579 | 1.377 | 10.502 | 0.983 | −1.092 | 10.502 |
| 2.652 | −2.249 | 10.502 | −2.604 | 1.406 | 10.502 | 1.165 | −1.209 | 10.502 |
| 2.528 | −2.190 | 10.502 | −2.622 | 1.429 | 10.502 | 1.347 | −1.324 | 10.502 |
| 2.391 | −2.124 | 10.502 | −2.634 | 1.447 | 10.502 | 1.523 | −1.436 | 10.502 |
| 2.241 | −2.051 | 10.502 | −2.642 | 1.463 | 10.502 | 1.694 | −1.543 | 10.502 |
| 2.084 | −1.976 | 10.502 | −2.646 | 1.477 | 10.502 | 1.858 | −1.645 | 10.502 |
| 1.921 | −1.896 | 10.502 | −2.644 | 1.487 | 10.502 | 2.017 | −1.744 | 10.502 |
| 1.752 | −1.812 | 10.502 | −2.634 | 1.490 | 10.502 | 2.170 | −1.838 | 10.502 |
| 1.577 | −1.724 | 10.502 | −2.620 | 1.486 | 10.502 | 2.318 | −1.928 | 10.502 |
| 1.397 | −1.631 | 10.502 | −2.604 | 1.479 | 10.502 | 2.459 | −2.014 | 10.502 |
| 1.211 | −1.533 | 10.502 | −2.585 | 1.468 | 10.502 | 2.588 | −2.092 | 10.502 |
| 1.020 | −1.429 | 10.502 | −2.561 | 1.452 | 10.502 | 2.705 | −2.162 | 10.502 |
| 0.831 | −1.322 | 10.502 | −2.531 | 1.430 | 10.502 | 2.810 | −2.225 | 10.502 |
| 0.643 | −1.213 | 10.502 | −2.494 | 1.401 | 10.502 | 2.903 | −2.281 | 10.502 |
| 0.457 | −1.101 | 10.502 | −2.449 | 1.366 | 10.502 | 2.983 | −2.329 | 10.502 |
| 0.273 | −0.985 | 10.502 | −2.396 | 1.324 | 10.502 | 3.051 | −2.369 | 10.502 |
| 0.090 | −0.867 | 10.502 | −2.334 | 1.275 | 10.502 | 3.109 | −2.404 | 10.502 |
| −0.090 | −0.745 | 10.502 | −2.261 | 1.217 | 10.502 | 3.158 | −2.433 | 10.502 |
| −0.269 | −0.621 | 10.502 | −2.176 | 1.150 | 10.502 | 3.198 | −2.456 | 10.502 |
| −0.446 | −0.495 | 10.502 | −2.080 | 1.075 | 10.502 | 3.230 | −2.476 | 10.502 |
| −0.621 | −0.366 | 10.502 | −1.972 | 0.990 | 10.502 | 3.255 | −2.490 | 10.502 |
| −0.795 | −0.234 | 10.502 | −1.853 | 0.897 | 10.502 | 3.274 | −2.501 | 10.502 |
| −0.966 | −0.100 | 10.502 | −1.723 | 0.796 | 10.502 | 3.288 | −2.511 | 10.502 |
| −1.130 | 0.031 | 10.502 | −1.586 | 0.691 | 10.502 | 3.294 | −2.524 | 10.502 |
| −1.287 | 0.160 | 10.502 | −1.443 | 0.582 | 10.502 | | | |
| −1.437 | 0.287 | 10.502 | −1.294 | 0.469 | 10.502 | | | |
| 3.201 | −2.754 | 11.814 | −1.518 | 0.437 | 11.814 | −1.106 | 0.332 | 11.814 |
| 3.193 | −2.762 | 11.814 | −1.650 | 0.561 | 11.814 | −0.948 | 0.205 | 11.814 |
| 3.179 | −2.763 | 11.814 | −1.776 | 0.681 | 11.814 | −0.784 | 0.076 | 11.814 |
| 3.163 | −2.755 | 11.814 | −1.896 | 0.797 | 11.814 | −0.614 | −0.057 | 11.814 |
| 3.144 | −2.745 | 11.814 | −2.004 | 0.905 | 11.814 | −0.443 | −0.189 | 11.814 |
| 3.118 | −2.731 | 11.814 | −2.101 | 1.002 | 11.814 | −0.271 | −0.320 | 11.814 |
| 3.085 | −2.713 | 11.814 | −2.187 | 1.091 | 11.814 | −0.098 | −0.450 | 11.814 |
| 3.044 | −2.690 | 11.814 | −2.262 | 1.170 | 11.814 | 0.075 | −0.578 | 11.814 |
| 2.994 | −2.662 | 11.814 | −2.327 | 1.238 | 11.814 | 0.250 | −0.706 | 11.814 |
| 2.934 | −2.629 | 11.814 | −2.381 | 1.297 | 11.814 | 0.425 | −0.832 | 11.814 |
| 2.864 | −2.591 | 11.814 | −2.427 | 1.347 | 11.814 | 0.601 | −0.958 | 11.814 |
| 2.782 | −2.546 | 11.814 | −2.465 | 1.390 | 11.814 | 0.777 | −1.083 | 11.814 |
| 2.686 | −2.494 | 11.814 | −2.496 | 1.425 | 11.814 | 0.953 | −1.208 | 11.814 |
| 2.578 | −2.434 | 11.814 | −2.521 | 1.454 | 11.814 | 1.130 | −1.333 | 11.814 |
| 2.457 | −2.368 | 11.814 | −2.539 | 1.477 | 11.814 | 1.307 | −1.457 | 11.814 |

TABLE 2R-continued

| X-LOC | Y-LOC | Z-LOC | X-LOC | Y-LOC | Z-LOC | X-LOC | Y-LOC | Z-LOC |
|---|---|---|---|---|---|---|---|---|
| 2.324 | −2.294 | 11.814 | −2.551 | 1.495 | 11.814 | 1.478 | −1.576 | 11.814 |
| 2.178 | −2.213 | 11.814 | −2.560 | 1.511 | 11.814 | 1.644 | −1.691 | 11.814 |
| 2.027 | −2.128 | 11.814 | −2.564 | 1.524 | 11.814 | 1.804 | −1.801 | 11.814 |
| 1.869 | −2.039 | 11.814 | −2.562 | 1.535 | 11.814 | 1.959 | −1.907 | 11.814 |
| 1.706 | −1.945 | 11.814 | −2.552 | 1.537 | 11.814 | 2.108 | −2.008 | 11.814 |
| 1.537 | −1.846 | 11.814 | −2.538 | 1.532 | 11.814 | 2.251 | −2.105 | 11.814 |
| 1.363 | −1.741 | 11.814 | −2.522 | 1.524 | 11.814 | 2.389 | −2.197 | 11.814 |
| 1.183 | −1.631 | 11.814 | −2.504 | 1.512 | 11.814 | 2.515 | −2.281 | 11.814 |
| 0.999 | −1.516 | 11.814 | −2.481 | 1.494 | 11.814 | 2.629 | −2.357 | 11.814 |
| 0.817 | −1.398 | 11.814 | −2.453 | 1.470 | 11.814 | 2.731 | −2.424 | 11.814 |
| 0.636 | −1.277 | 11.814 | −2.417 | 1.440 | 11.814 | 2.821 | −2.484 | 11.814 |
| 0.456 | −1.155 | 11.814 | −2.374 | 1.403 | 11.814 | 2.900 | −2.535 | 11.814 |
| 0.279 | −1.029 | 11.814 | −2.322 | 1.358 | 11.814 | 2.966 | −2.578 | 11.814 |
| 0.103 | −0.902 | 11.814 | −2.263 | 1.307 | 11.814 | 3.023 | −2.616 | 11.814 |
| −0.072 | −0.772 | 11.814 | −2.192 | 1.245 | 11.814 | 3.070 | −2.647 | 11.814 |
| −0.245 | −0.640 | 11.814 | −2.110 | 1.174 | 11.814 | 3.110 | −2.672 | 11.814 |
| −0.416 | −0.506 | 11.814 | −2.018 | 1.094 | 11.814 | 3.141 | −2.693 | 11.814 |
| −0.586 | −0.370 | 11.814 | −1.914 | 1.005 | 11.814 | 3.165 | −2.708 | 11.814 |
| −0.754 | −0.232 | 11.814 | −1.799 | 0.907 | 11.814 | 3.183 | −2.720 | 11.814 |
| −0.921 | −0.093 | 11.814 | −1.672 | 0.800 | 11.814 | 3.198 | −2.730 | 11.814 |
| −1.081 | 0.045 | 11.814 | −1.540 | 0.688 | 11.814 | 3.203 | −2.744 | 11.814 |
| −1.233 | 0.178 | 11.814 | −1.401 | 0.573 | 11.814 | | | |
| −1.379 | 0.309 | 11.814 | −1.257 | 0.454 | 11.814 | | | |
| 3.112 | −2.840 | 12.689 | −1.487 | 0.504 | 12.689 | −1.088 | 0.376 | 12.689 |
| 3.104 | −2.848 | 12.689 | −1.616 | 0.631 | 12.689 | −0.935 | 0.246 | 12.689 |
| 3.090 | −2.849 | 12.689 | −1.738 | 0.754 | 12.689 | −0.775 | 0.111 | 12.689 |
| 3.074 | −2.840 | 12.689 | −1.855 | 0.873 | 12.689 | −0.609 | −0.027 | 12.689 |
| 3.055 | −2.829 | 12.689 | −1.960 | 0.983 | 12.689 | −0.443 | −0.164 | 12.689 |
| 3.030 | −2.815 | 12.689 | −2.054 | 1.083 | 12.689 | −0.275 | −0.300 | 12.689 |
| 2.998 | −2.796 | 12.689 | −2.138 | 1.173 | 12.689 | −0.107 | −0.435 | 12.689 |
| 2.957 | −2.772 | 12.689 | −2.211 | 1.253 | 12.689 | 0.062 | −0.569 | 12.689 |
| 2.908 | −2.743 | 12.689 | −2.274 | 1.323 | 12.689 | 0.232 | −0.702 | 12.689 |
| 2.849 | −2.708 | 12.689 | −2.327 | 1.383 | 12.689 | 0.402 | −0.835 | 12.689 |
| 2.781 | −2.668 | 12.689 | −2.371 | 1.434 | 12.689 | 0.574 | −0.966 | 12.689 |
| 2.700 | −2.620 | 12.689 | −2.408 | 1.478 | 12.689 | 0.745 | −1.097 | 12.689 |
| 2.606 | −2.565 | 12.689 | −2.439 | 1.514 | 12.689 | 0.917 | −1.227 | 12.689 |
| 2.500 | −2.502 | 12.689 | −2.463 | 1.543 | 12.689 | 1.090 | −1.357 | 12.689 |
| 2.382 | −2.432 | 12.689 | −2.480 | 1.566 | 12.689 | 1.262 | −1.486 | 12.689 |
| 2.252 | −2.354 | 12.689 | −2.492 | 1.584 | 12.689 | 1.430 | −1.611 | 12.689 |
| 2.109 | −2.268 | 12.689 | −2.501 | 1.600 | 12.689 | 1.592 | −1.731 | 12.689 |
| 1.961 | −2.178 | 12.689 | −2.505 | 1.613 | 12.689 | 1.748 | −1.846 | 12.689 |
| 1.807 | −2.083 | 12.689 | −2.504 | 1.624 | 12.689 | 1.899 | −1.957 | 12.689 |
| 1.648 | −1.983 | 12.689 | −2.493 | 1.625 | 12.689 | 2.044 | −2.063 | 12.689 |
| 1.483 | −1.878 | 12.689 | −2.480 | 1.620 | 12.689 | 2.184 | −2.164 | 12.689 |
| 1.313 | −1.767 | 12.689 | −2.464 | 1.611 | 12.689 | 2.318 | −2.261 | 12.689 |
| 1.139 | −1.651 | 12.689 | −2.447 | 1.598 | 12.689 | 2.441 | −2.349 | 12.689 |
| 0.959 | −1.528 | 12.689 | −2.425 | 1.580 | 12.689 | 2.553 | −2.428 | 12.689 |
| 0.782 | −1.404 | 12.689 | −2.397 | 1.555 | 12.689 | 2.653 | −2.498 | 12.689 |
| 0.606 | −1.277 | 12.689 | −2.362 | 1.523 | 12.689 | 2.741 | −2.560 | 12.689 |
| 0.432 | −1.147 | 12.689 | −2.321 | 1.485 | 12.689 | 2.817 | −2.614 | 12.689 |
| 0.259 | −1.016 | 12.689 | −2.271 | 1.439 | 12.689 | 2.882 | −2.659 | 12.689 |
| 0.088 | −0.882 | 12.689 | −2.213 | 1.385 | 12.689 | 2.938 | −2.698 | 12.689 |
| −0.081 | −0.746 | 12.689 | −2.144 | 1.321 | 12.689 | 2.985 | −2.730 | 12.689 |
| −0.249 | −0.608 | 12.689 | −2.065 | 1.248 | 12.689 | 3.023 | −2.757 | 12.689 |
| −0.415 | −0.469 | 12.689 | −1.975 | 1.165 | 12.689 | 3.054 | −2.778 | 12.689 |
| −0.580 | −0.328 | 12.689 | −1.874 | 1.073 | 12.689 | 3.078 | −2.794 | 12.689 |
| −0.744 | −0.185 | 12.689 | −1.762 | 0.971 | 12.689 | 3.096 | −2.806 | 12.689 |
| −0.906 | −0.041 | 12.689 | −1.639 | 0.860 | 12.689 | 3.110 | −2.817 | 12.689 |
| −1.061 | 0.101 | 12.689 | −1.511 | 0.745 | 12.689 | 3.114 | −2.830 | 12.689 |
| −1.210 | 0.239 | 12.689 | −1.376 | 0.626 | 12.689 | | | |
| −1.352 | 0.373 | 12.689 | −1.235 | 0.503 | 12.689 | | | |
| 2.945 | −2.847 | 14.002 | −1.454 | 0.755 | 14.002 | −1.075 | 0.591 | 14.002 |
| 2.937 | −2.854 | 14.002 | −1.574 | 0.891 | 14.002 | −0.932 | 0.450 | 14.002 |
| 2.923 | −2.854 | 14.002 | −1.687 | 1.023 | 14.002 | −0.783 | 0.304 | 14.002 |
| 2.907 | −2.845 | 14.002 | −1.795 | 1.150 | 14.002 | −0.627 | 0.154 | 14.002 |
| 2.889 | −2.833 | 14.002 | −1.892 | 1.267 | 14.002 | −0.470 | 0.006 | 14.002 |
| 2.864 | −2.818 | 14.002 | −1.979 | 1.373 | 14.002 | −0.312 | −0.141 | 14.002 |
| 2.832 | −2.798 | 14.002 | −2.057 | 1.469 | 14.002 | −0.153 | −0.287 | 14.002 |
| 2.792 | −2.774 | 14.002 | −2.124 | 1.555 | 14.002 | 0.007 | −0.432 | 14.002 |
| 2.744 | −2.743 | 14.002 | −2.182 | 1.629 | 14.002 | 0.169 | −0.575 | 14.002 |
| 2.686 | −2.707 | 14.002 | −2.230 | 1.693 | 14.002 | 0.331 | −0.717 | 14.002 |
| 2.618 | −2.665 | 14.002 | −2.271 | 1.747 | 14.002 | 0.494 | −0.858 | 14.002 |
| 2.539 | −2.614 | 14.002 | −2.305 | 1.793 | 14.002 | 0.658 | −0.998 | 14.002 |
| 2.448 | −2.555 | 14.002 | −2.333 | 1.831 | 14.002 | 0.823 | −1.138 | 14.002 |
| 2.344 | −2.489 | 14.002 | −2.355 | 1.862 | 14.002 | 0.989 | −1.277 | 14.002 |
| 2.228 | −2.414 | 14.002 | −2.371 | 1.886 | 14.002 | 1.154 | −1.415 | 14.002 |
| 2.101 | −2.331 | 14.002 | −2.382 | 1.904 | 14.002 | 1.315 | −1.548 | 14.002 |

TABLE 2R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.962 | −2.239 | 14.002 | −2.390 | 1.921 | 14.002 | 1.471 | −1.676 | 14.002 |
| 1.817 | −2.142 | 14.002 | −2.394 | 1.935 | 14.002 | 1.621 | −1.799 | 14.002 |
| 1.668 | −2.040 | 14.002 | −2.392 | 1.945 | 14.002 | 1.767 | −1.917 | 14.002 |
| 1.513 | −1.932 | 14.002 | −2.381 | 1.945 | 14.002 | 1.907 | −2.029 | 14.002 |
| 1.354 | −1.818 | 14.002 | −2.368 | 1.939 | 14.002 | 2.042 | −2.137 | 14.002 |
| 1.191 | −1.699 | 14.002 | −2.354 | 1.928 | 14.002 | 2.172 | −2.239 | 14.002 |
| 1.023 | −1.572 | 14.002 | −2.338 | 1.913 | 14.002 | 2.291 | −2.332 | 14.002 |
| 0.851 | −1.439 | 14.002 | −2.318 | 1.893 | 14.002 | 2.399 | −2.416 | 14.002 |
| 0.682 | −1.304 | 14.002 | −2.292 | 1.866 | 14.002 | 2.497 | −2.490 | 14.002 |
| 0.514 | −1.166 | 14.002 | −2.260 | 1.831 | 14.002 | 2.583 | −2.555 | 14.002 |
| 0.348 | −1.026 | 14.002 | −2.222 | 1.790 | 14.002 | 2.658 | −2.611 | 14.002 |
| 0.185 | −0.883 | 14.002 | −2.176 | 1.740 | 14.002 | 2.721 | −2.658 | 14.002 |
| 0.022 | −0.739 | 14.002 | −2.122 | 1.682 | 14.002 | 2.775 | −2.699 | 14.002 |
| −0.138 | −0.592 | 14.002 | −2.058 | 1.613 | 14.002 | 2.821 | −2.733 | 14.002 |
| −0.296 | −0.443 | 14.002 | −1.985 | 1.534 | 14.002 | 2.859 | −2.760 | 14.002 |
| −0.453 | −0.293 | 14.002 | −1.901 | 1.445 | 14.002 | 2.889 | −2.783 | 14.002 |
| −0.608 | −0.140 | 14.002 | −1.808 | 1.345 | 14.002 | 2.912 | −2.800 | 14.002 |
| −0.761 | 0.014 | 14.002 | −1.704 | 1.235 | 14.002 | 2.930 | −2.812 | 14.002 |
| −0.913 | 0.170 | 14.002 | −1.590 | 1.115 | 14.002 | 2.944 | −2.823 | 14.002 |
| −1.058 | 0.322 | 14.002 | −1.470 | 0.991 | 14.002 | 2.948 | −2.837 | 14.002 |
| −1.196 | 0.470 | 14.002 | −1.344 | 0.862 | 14.002 | | | |
| −1.328 | 0.615 | 14.002 | −1.213 | 0.729 | 14.002 | | | |

The coordinate values given in TABLE 3R below provide the nominal profile envelope for an exemplary third stage rotor.

TABLE 3R

| X-LOC | Y-LOC | Z-LOC | X-LOC | Y-LOC | Z-LOC | X-LOC | Y-LOC | Z-LOC |
|---|---|---|---|---|---|---|---|---|
| 3.531 | 0.003 | 0.000 | −1.940 | −0.262 | 0.000 | −1.404 | 0.093 | 0.000 |
| 3.532 | −0.008 | 0.000 | −2.100 | −0.188 | 0.000 | −1.218 | 0.064 | 0.000 |
| 3.528 | −0.021 | 0.000 | −2.251 | −0.110 | 0.000 | −1.024 | 0.039 | 0.000 |
| 3.519 | −0.036 | 0.000 | −2.392 | −0.026 | 0.000 | −0.824 | 0.019 | 0.000 |
| 3.501 | −0.048 | 0.000 | −2.518 | 0.056 | 0.000 | −0.623 | 0.003 | 0.000 |
| 3.473 | −0.053 | 0.000 | −2.628 | 0.135 | 0.000 | −0.421 | −0.009 | 0.000 |
| 3.437 | −0.059 | 0.000 | −2.723 | 0.212 | 0.000 | −0.219 | −0.016 | 0.000 |
| 3.391 | −0.067 | 0.000 | −2.804 | 0.281 | 0.000 | −0.017 | −0.021 | 0.000 |
| 3.336 | −0.077 | 0.000 | −2.873 | 0.344 | 0.000 | 0.185 | −0.023 | 0.000 |
| 3.271 | −0.090 | 0.000 | −2.929 | 0.399 | 0.000 | 0.387 | −0.024 | 0.000 |
| 3.194 | −0.105 | 0.000 | −2.976 | 0.448 | 0.000 | 0.590 | −0.024 | 0.000 |
| 3.104 | −0.123 | 0.000 | −3.013 | 0.491 | 0.000 | 0.792 | −0.025 | 0.000 |
| 3.000 | −0.145 | 0.000 | −3.041 | 0.528 | 0.000 | 0.994 | −0.024 | 0.000 |
| 2.882 | −0.171 | 0.000 | −3.060 | 0.560 | 0.000 | 1.196 | −0.024 | 0.000 |
| 2.751 | −0.199 | 0.000 | −3.071 | 0.587 | 0.000 | 1.398 | −0.023 | 0.000 |
| 2.605 | −0.231 | 0.000 | −3.075 | 0.608 | 0.000 | 1.594 | −0.021 | 0.000 |
| 2.446 | −0.265 | 0.000 | −3.075 | 0.626 | 0.000 | 1.782 | −0.020 | 0.000 |
| 2.279 | −0.301 | 0.000 | −3.072 | 0.640 | 0.000 | 1.964 | −0.018 | 0.000 |
| 2.106 | −0.337 | 0.000 | −3.066 | 0.649 | 0.000 | 2.139 | −0.015 | 0.000 |
| 1.926 | −0.373 | 0.000 | −3.059 | 0.656 | 0.000 | 2.308 | −0.012 | 0.000 |
| 1.738 | −0.409 | 0.000 | −3.046 | 0.661 | 0.000 | 2.469 | −0.008 | 0.000 |
| 1.543 | −0.445 | 0.000 | −3.029 | 0.663 | 0.000 | 2.624 | −0.004 | 0.000 |
| 1.341 | −0.480 | 0.000 | −3.009 | 0.661 | 0.000 | 2.766 | 0.000 | 0.000 |
| 1.132 | −0.512 | 0.000 | −2.983 | 0.653 | 0.000 | 2.894 | 0.005 | 0.000 |
| 0.922 | −0.541 | 0.000 | −2.951 | 0.640 | 0.000 | 3.008 | 0.010 | 0.000 |
| 0.711 | −0.566 | 0.000 | −2.911 | 0.621 | 0.000 | 3.109 | 0.015 | 0.000 |
| 0.501 | −0.587 | 0.000 | −2.863 | 0.598 | 0.000 | 3.197 | 0.020 | 0.000 |
| 0.289 | −0.601 | 0.000 | −2.806 | 0.570 | 0.000 | 3.271 | 0.025 | 0.000 |
| 0.077 | −0.610 | 0.000 | −2.740 | 0.536 | 0.000 | 3.334 | 0.030 | 0.000 |
| −0.137 | −0.611 | 0.000 | −2.661 | 0.497 | 0.000 | 3.387 | 0.035 | 0.000 |
| −0.350 | −0.605 | 0.000 | −2.570 | 0.454 | 0.000 | 3.430 | 0.039 | 0.000 |
| −0.564 | −0.591 | 0.000 | −2.466 | 0.406 | 0.000 | 3.465 | 0.042 | 0.000 |
| −0.776 | −0.567 | 0.000 | −2.348 | 0.357 | 0.000 | 3.492 | 0.043 | 0.000 |
| −0.987 | −0.535 | 0.000 | −2.217 | 0.306 | 0.000 | 3.511 | 0.036 | 0.000 |
| −1.196 | −0.494 | 0.000 | −2.071 | 0.255 | 0.000 | 3.523 | 0.024 | 0.000 |
| −1.398 | −0.446 | 0.000 | −1.916 | 0.208 | 0.000 | 3.529 | 0.013 | 0.000 |
| −1.589 | −0.391 | 0.000 | −1.753 | 0.165 | 0.000 | | | |
| −1.769 | −0.329 | 0.000 | −1.582 | 0.127 | 0.000 | | | |
| 3.467 | −0.257 | 1.137 | −1.901 | 0.055 | 1.137 | −1.408 | 0.324 | 1.137 |
| 3.466 | −0.267 | 1.137 | −2.059 | 0.132 | 1.137 | −1.227 | 0.274 | 1.137 |
| 3.462 | −0.280 | 1.137 | −2.208 | 0.210 | 1.137 | −1.039 | 0.226 | 1.137 |
| 3.451 | −0.293 | 1.137 | −2.349 | 0.290 | 1.137 | −0.844 | 0.179 | 1.137 |

TABLE 3R-continued

| X-LOC | Y-LOC | Z-LOC | X-LOC | Y-LOC | Z-LOC | X-LOC | Y-LOC | Z-LOC |
|---|---|---|---|---|---|---|---|---|
| 3.432 | −0.302 | 1.137 | −2.475 | 0.367 | 1.137 | −0.647 | 0.136 | 1.137 |
| 3.404 | −0.305 | 1.137 | −2.587 | 0.441 | 1.137 | −0.449 | 0.097 | 1.137 |
| 3.368 | −0.309 | 1.137 | −2.684 | 0.510 | 1.137 | −0.252 | 0.060 | 1.137 |
| 3.323 | −0.313 | 1.137 | −2.768 | 0.574 | 1.137 | −0.053 | 0.027 | 1.137 |
| 3.269 | −0.319 | 1.137 | −2.840 | 0.630 | 1.137 | 0.145 | −0.004 | 1.137 |
| 3.204 | −0.327 | 1.137 | −2.899 | 0.680 | 1.137 | 0.344 | −0.032 | 1.137 |
| 3.128 | −0.335 | 1.137 | −2.948 | 0.725 | 1.137 | 0.544 | −0.059 | 1.137 |
| 3.038 | −0.346 | 1.137 | −2.988 | 0.763 | 1.137 | 0.743 | −0.083 | 1.137 |
| 2.935 | −0.359 | 1.137 | −3.019 | 0.797 | 1.137 | 0.943 | −0.105 | 1.137 |
| 2.817 | −0.374 | 1.137 | −3.041 | 0.826 | 1.137 | 1.143 | −0.125 | 1.137 |
| 2.686 | −0.390 | 1.137 | −3.055 | 0.850 | 1.137 | 1.344 | −0.143 | 1.137 |
| 2.541 | −0.408 | 1.137 | −3.062 | 0.870 | 1.137 | 1.538 | −0.159 | 1.137 |
| 2.383 | −0.426 | 1.137 | −3.064 | 0.888 | 1.137 | 1.725 | −0.173 | 1.137 |
| 2.217 | −0.445 | 1.137 | −3.062 | 0.902 | 1.137 | 1.906 | −0.184 | 1.137 |
| 2.044 | −0.463 | 1.137 | −3.057 | 0.911 | 1.137 | 2.080 | −0.194 | 1.137 |
| 1.865 | −0.480 | 1.137 | −3.050 | 0.918 | 1.137 | 2.247 | −0.203 | 1.137 |
| 1.679 | −0.495 | 1.137 | −3.038 | 0.924 | 1.137 | 2.408 | −0.210 | 1.137 |
| 1.486 | −0.508 | 1.137 | −3.021 | 0.926 | 1.137 | 2.562 | −0.215 | 1.137 |
| 1.286 | −0.519 | 1.137 | −3.001 | 0.924 | 1.137 | 2.703 | −0.219 | 1.137 |
| 1.079 | −0.526 | 1.137 | −2.975 | 0.917 | 1.137 | 2.831 | −0.222 | 1.137 |
| 0.872 | −0.528 | 1.137 | −2.943 | 0.904 | 1.137 | 2.945 | −0.224 | 1.137 |
| 0.665 | −0.526 | 1.137 | −2.902 | 0.887 | 1.137 | 3.045 | −0.224 | 1.137 |
| 0.459 | −0.518 | 1.137 | −2.854 | 0.866 | 1.137 | 3.133 | −0.224 | 1.137 |
| 0.252 | −0.504 | 1.137 | −2.796 | 0.840 | 1.137 | 3.206 | −0.223 | 1.137 |
| 0.046 | −0.484 | 1.137 | −2.729 | 0.810 | 1.137 | 3.269 | −0.222 | 1.137 |
| −0.161 | −0.458 | 1.137 | −2.649 | 0.774 | 1.137 | 3.322 | −0.221 | 1.137 |
| −0.367 | −0.425 | 1.137 | −2.557 | 0.733 | 1.137 | 3.366 | −0.219 | 1.137 |
| −0.573 | −0.385 | 1.137 | −2.452 | 0.688 | 1.137 | 3.401 | −0.218 | 1.137 |
| −0.779 | −0.338 | 1.137 | −2.335 | 0.640 | 1.137 | 3.428 | −0.217 | 1.137 |
| −0.982 | −0.284 | 1.137 | −2.203 | 0.588 | 1.137 | 3.447 | −0.223 | 1.137 |
| −1.183 | −0.224 | 1.137 | −2.059 | 0.534 | 1.137 | 3.459 | −0.235 | 1.137 |
| −1.375 | −0.159 | 1.137 | −1.907 | 0.481 | 1.137 | 3.465 | −0.247 | 1.137 |
| −1.559 | −0.091 | 1.137 | −1.748 | 0.428 | 1.137 | | | |
| −1.734 | −0.019 | 1.137 | −1.581 | 0.376 | 1.137 | | | |
| 3.424 | −0.423 | 2.274 | −1.886 | 0.220 | 2.274 | −1.417 | 0.403 | 2.274 |
| 3.423 | −0.433 | 2.274 | −2.040 | 0.301 | 2.274 | −1.240 | 0.340 | 2.274 |
| 3.417 | −0.445 | 2.274 | −2.185 | 0.383 | 2.274 | −1.055 | 0.280 | 2.274 |
| 3.404 | −0.457 | 2.274 | −2.323 | 0.465 | 2.274 | −0.862 | 0.221 | 2.274 |
| 3.385 | −0.462 | 2.274 | −2.446 | 0.542 | 2.274 | −0.668 | 0.166 | 2.274 |
| 3.357 | −0.463 | 2.274 | −2.556 | 0.615 | 2.274 | −0.473 | 0.115 | 2.274 |
| 3.321 | −0.464 | 2.274 | −2.653 | 0.683 | 2.274 | −0.278 | 0.067 | 2.274 |
| 3.276 | −0.466 | 2.274 | −2.737 | 0.745 | 2.274 | −0.082 | 0.022 | 2.274 |
| 3.222 | −0.468 | 2.274 | −2.809 | 0.800 | 2.274 | 0.115 | −0.019 | 2.274 |
| 3.157 | −0.471 | 2.274 | −2.869 | 0.847 | 2.274 | 0.312 | −0.057 | 2.274 |
| 3.081 | −0.474 | 2.274 | −2.919 | 0.889 | 2.274 | 0.510 | −0.094 | 2.274 |
| 2.991 | −0.479 | 2.274 | −2.960 | 0.926 | 2.274 | 0.708 | −0.127 | 2.274 |
| 2.888 | −0.484 | 2.274 | −2.993 | 0.957 | 2.274 | 0.907 | −0.158 | 2.274 |
| 2.770 | −0.490 | 2.274 | −3.017 | 0.983 | 2.274 | 1.106 | −0.188 | 2.274 |
| 2.639 | −0.497 | 2.274 | −3.033 | 1.006 | 2.274 | 1.306 | −0.215 | 2.274 |
| 2.494 | −0.504 | 2.274 | −3.042 | 1.025 | 2.274 | 1.499 | −0.239 | 2.274 |
| 2.335 | −0.512 | 2.274 | −3.046 | 1.042 | 2.274 | 1.686 | −0.260 | 2.274 |
| 2.170 | −0.518 | 2.274 | −3.045 | 1.056 | 2.274 | 1.866 | −0.280 | 2.274 |
| 1.997 | −0.524 | 2.274 | −3.041 | 1.065 | 2.274 | 2.039 | −0.297 | 2.274 |
| 1.818 | −0.528 | 2.274 | −3.033 | 1.072 | 2.274 | 2.207 | −0.313 | 2.274 |
| 1.631 | −0.531 | 2.274 | −3.020 | 1.077 | 2.274 | 2.367 | −0.327 | 2.274 |
| 1.438 | −0.531 | 2.274 | −3.004 | 1.077 | 2.274 | 2.521 | −0.339 | 2.274 |
| 1.238 | −0.528 | 2.274 | −2.984 | 1.074 | 2.274 | 2.662 | −0.349 | 2.274 |
| 1.032 | −0.521 | 2.274 | −2.958 | 1.065 | 2.274 | 2.789 | −0.358 | 2.274 |
| 0.826 | −0.509 | 2.274 | −2.926 | 1.052 | 2.274 | 2.903 | −0.365 | 2.274 |
| 0.621 | −0.494 | 2.274 | −2.886 | 1.035 | 2.274 | 3.003 | −0.371 | 2.274 |
| 0.416 | −0.473 | 2.274 | −2.838 | 1.013 | 2.274 | 3.091 | −0.375 | 2.274 |
| 0.213 | −0.447 | 2.274 | −2.780 | 0.986 | 2.274 | 3.164 | −0.378 | 2.274 |
| 0.010 | −0.414 | 2.274 | −2.714 | 0.954 | 2.274 | 3.227 | −0.380 | 2.274 |
| −0.193 | −0.376 | 2.274 | −2.635 | 0.916 | 2.274 | 3.281 | −0.381 | 2.274 |
| −0.394 | −0.332 | 2.274 | −2.544 | 0.873 | 2.274 | 3.324 | −0.382 | 2.274 |
| −0.594 | −0.281 | 2.274 | −2.440 | 0.825 | 2.274 | 3.359 | −0.383 | 2.274 |
| −0.794 | −0.224 | 2.274 | −2.324 | 0.772 | 2.274 | 3.386 | −0.384 | 2.274 |
| −0.993 | −0.161 | 2.274 | −2.195 | 0.714 | 2.274 | 3.405 | −0.389 | 2.274 |
| −1.189 | −0.090 | 2.274 | −2.054 | 0.653 | 2.274 | 3.417 | −0.401 | 2.274 |
| −1.376 | −0.017 | 2.274 | −1.905 | 0.591 | 2.274 | 3.423 | −0.413 | 2.274 |
| −1.554 | 0.060 | 2.274 | −1.749 | 0.528 | 2.274 | | | |
| −1.725 | 0.139 | 2.274 | −1.587 | 0.465 | 2.274 | | | |
| 3.406 | −0.573 | 3.032 | −1.869 | 0.261 | 3.032 | −1.409 | 0.406 | 3.032 |
| 3.404 | −0.583 | 3.032 | −2.021 | 0.345 | 3.032 | −1.234 | 0.340 | 3.032 |
| 3.398 | −0.595 | 3.032 | −2.164 | 0.429 | 3.032 | −1.052 | 0.275 | 3.032 |
| 3.384 | −0.605 | 3.032 | −2.300 | 0.513 | 3.032 | −0.862 | 0.211 | 3.032 |
| 3.364 | −0.608 | 3.032 | −2.422 | 0.592 | 3.032 | −0.670 | 0.151 | 3.032 |

TABLE 3R-continued

| X-LOC | Y-LOC | Z-LOC | X-LOC | Y-LOC | Z-LOC | X-LOC | Y-LOC | Z-LOC |
|---|---|---|---|---|---|---|---|---|
| 3.336 | −0.608 | 3.032 | −2.531 | 0.666 | 3.032 | −0.478 | 0.095 | 3.032 |
| 3.300 | −0.607 | 3.032 | −2.627 | 0.734 | 3.032 | −0.284 | 0.041 | 3.032 |
| 3.256 | −0.607 | 3.032 | −2.711 | 0.797 | 3.032 | −0.090 | −0.010 | 3.032 |
| 3.201 | −0.606 | 3.032 | −2.782 | 0.851 | 3.032 | 0.105 | −0.057 | 3.032 |
| 3.137 | −0.606 | 3.032 | −2.842 | 0.899 | 3.032 | 0.302 | −0.102 | 3.032 |
| 3.061 | −0.606 | 3.032 | −2.892 | 0.941 | 3.032 | 0.499 | −0.144 | 3.032 |
| 2.971 | −0.606 | 3.032 | −2.933 | 0.977 | 3.032 | 0.696 | −0.184 | 3.032 |
| 2.868 | −0.607 | 3.032 | −2.966 | 1.008 | 3.032 | 0.895 | −0.221 | 3.032 |
| 2.751 | −0.607 | 3.032 | −2.992 | 1.034 | 3.032 | 1.093 | −0.256 | 3.032 |
| 2.620 | −0.608 | 3.032 | −3.008 | 1.056 | 3.032 | 1.292 | −0.289 | 3.032 |
| 2.476 | −0.609 | 3.032 | −3.018 | 1.074 | 3.032 | 1.485 | −0.320 | 3.032 |
| 2.317 | −0.609 | 3.032 | −3.023 | 1.091 | 3.032 | 1.671 | −0.348 | 3.032 |
| 2.152 | −0.608 | 3.032 | −3.022 | 1.105 | 3.032 | 1.850 | −0.373 | 3.032 |
| 1.980 | −0.606 | 3.032 | −3.018 | 1.114 | 3.032 | 2.024 | −0.396 | 3.032 |
| 1.801 | −0.602 | 3.032 | −3.010 | 1.121 | 3.032 | 2.190 | −0.418 | 3.032 |
| 1.616 | −0.596 | 3.032 | −2.997 | 1.124 | 3.032 | 2.351 | −0.437 | 3.032 |
| 1.424 | −0.588 | 3.032 | −2.980 | 1.123 | 3.032 | 2.504 | −0.455 | 3.032 |
| 1.225 | −0.576 | 3.032 | −2.961 | 1.118 | 3.032 | 2.645 | −0.471 | 3.032 |
| 1.021 | −0.561 | 3.032 | −2.935 | 1.109 | 3.032 | 2.772 | −0.484 | 3.032 |
| 0.817 | −0.542 | 3.032 | −2.903 | 1.096 | 3.032 | 2.885 | −0.495 | 3.032 |
| 0.613 | −0.518 | 3.032 | −2.863 | 1.077 | 3.032 | 2.986 | −0.505 | 3.032 |
| 0.410 | −0.490 | 3.032 | −2.816 | 1.054 | 3.032 | 3.073 | −0.513 | 3.032 |
| 0.208 | −0.457 | 3.032 | −2.759 | 1.025 | 3.032 | 3.147 | −0.519 | 3.032 |
| 0.007 | −0.418 | 3.032 | −2.693 | 0.992 | 3.032 | 3.210 | −0.523 | 3.032 |
| −0.193 | −0.373 | 3.032 | −2.615 | 0.953 | 3.032 | 3.263 | −0.527 | 3.032 |
| −0.392 | −0.323 | 3.032 | −2.524 | 0.907 | 3.032 | 3.306 | −0.530 | 3.032 |
| −0.591 | −0.266 | 3.032 | −2.422 | 0.856 | 3.032 | 3.341 | −0.532 | 3.032 |
| −0.788 | −0.204 | 3.032 | −2.307 | 0.800 | 3.032 | 3.368 | −0.534 | 3.032 |
| −0.984 | −0.135 | 3.032 | −2.180 | 0.739 | 3.032 | 3.387 | −0.539 | 3.032 |
| −1.179 | −0.061 | 3.032 | −2.039 | 0.673 | 3.032 | 3.399 | −0.550 | 3.032 |
| −1.364 | 0.016 | 3.032 | −1.892 | 0.607 | 3.032 | 3.405 | −0.563 | 3.032 |
| −1.541 | 0.096 | 3.032 | −1.738 | 0.540 | 3.032 | | | |
| −1.709 | 0.178 | 3.032 | −1.577 | 0.473 | 3.032 | | | |
| 3.380 | −0.983 | 4.548 | −1.816 | 0.256 | 4.548 | −1.358 | 0.361 | 4.548 |
| 3.377 | −0.993 | 4.548 | −1.963 | 0.345 | 4.548 | −1.186 | 0.286 | 4.548 |
| 3.369 | −1.004 | 4.548 | −2.101 | 0.433 | 4.548 | −1.006 | 0.212 | 4.548 |
| 3.354 | −1.011 | 4.548 | −2.233 | 0.521 | 4.548 | −0.820 | 0.138 | 4.548 |
| 3.333 | −1.010 | 4.548 | −2.351 | 0.604 | 4.548 | −0.632 | 0.067 | 4.548 |
| 3.306 | −1.007 | 4.548 | −2.457 | 0.682 | 4.548 | −0.443 | −0.002 | 4.548 |
| 3.270 | −1.003 | 4.548 | −2.551 | 0.753 | 4.548 | −0.252 | −0.067 | 4.548 |
| 3.226 | −0.998 | 4.548 | −2.632 | 0.818 | 4.548 | −0.061 | −0.130 | 4.548 |
| 3.172 | −0.992 | 4.548 | −2.701 | 0.875 | 4.548 | 0.131 | −0.190 | 4.548 |
| 3.107 | −0.985 | 4.548 | −2.759 | 0.924 | 4.548 | 0.324 | −0.248 | 4.548 |
| 3.032 | −0.978 | 4.548 | −2.808 | 0.967 | 4.548 | 0.518 | −0.305 | 4.548 |
| 2.943 | −0.970 | 4.548 | −2.848 | 1.004 | 4.548 | 0.712 | −0.359 | 4.548 |
| 2.841 | −0.960 | 4.548 | −2.880 | 1.036 | 4.548 | 0.907 | −0.411 | 4.548 |
| 2.724 | −0.950 | 4.548 | −2.905 | 1.062 | 4.548 | 1.102 | −0.462 | 4.548 |
| 2.594 | −0.938 | 4.548 | −2.922 | 1.083 | 4.548 | 1.298 | −0.511 | 4.548 |
| 2.450 | −0.925 | 4.548 | −2.932 | 1.101 | 4.548 | 1.487 | −0.557 | 4.548 |
| 2.293 | −0.910 | 4.548 | −2.937 | 1.118 | 4.548 | 1.670 | −0.600 | 4.548 |
| 2.129 | −0.893 | 4.548 | −2.937 | 1.132 | 4.548 | 1.847 | −0.641 | 4.548 |
| 1.958 | −0.875 | 4.548 | −2.933 | 1.141 | 4.548 | 2.017 | −0.680 | 4.548 |
| 1.781 | −0.855 | 4.548 | −2.924 | 1.147 | 4.548 | 2.181 | −0.716 | 4.548 |
| 1.597 | −0.833 | 4.548 | −2.911 | 1.148 | 4.548 | 2.339 | −0.750 | 4.548 |
| 1.406 | −0.807 | 4.548 | −2.894 | 1.146 | 4.548 | 2.490 | −0.782 | 4.548 |
| 1.209 | −0.779 | 4.548 | −2.875 | 1.140 | 4.548 | 2.629 | −0.811 | 4.548 |
| 1.006 | −0.746 | 4.548 | −2.850 | 1.129 | 4.548 | 2.754 | −0.836 | 4.548 |
| 0.804 | −0.710 | 4.548 | −2.819 | 1.114 | 4.548 | 2.866 | −0.858 | 4.548 |
| 0.602 | −0.669 | 4.548 | −2.780 | 1.094 | 4.548 | 2.965 | −0.878 | 4.548 |
| 0.401 | −0.625 | 4.548 | −2.733 | 1.068 | 4.548 | 3.051 | −0.894 | 4.548 |
| 0.200 | −0.576 | 4.548 | −2.678 | 1.037 | 4.548 | 3.123 | −0.907 | 4.548 |
| 0.001 | −0.521 | 4.548 | −2.614 | 1.001 | 4.548 | 3.186 | −0.918 | 4.548 |
| −0.197 | −0.462 | 4.548 | −2.537 | 0.958 | 4.548 | 3.238 | −0.927 | 4.548 |
| −0.393 | −0.398 | 4.548 | −2.449 | 0.909 | 4.548 | 3.281 | −0.934 | 4.548 |
| −0.587 | −0.329 | 4.548 | −2.349 | 0.854 | 4.548 | 3.316 | −0.940 | 4.548 |
| −0.778 | −0.255 | 4.548 | −2.237 | 0.793 | 4.548 | 3.342 | −0.944 | 4.548 |
| −0.967 | −0.176 | 4.548 | −2.112 | 0.727 | 4.548 | 3.362 | −0.949 | 4.548 |
| −1.153 | −0.093 | 4.548 | −1.975 | 0.656 | 4.548 | 3.374 | −0.960 | 4.548 |
| −1.331 | −0.007 | 4.548 | −1.831 | 0.583 | 4.548 | 3.380 | −0.973 | 4.548 |
| −1.501 | 0.080 | 4.548 | −1.680 | 0.510 | 4.548 | | | |
| −1.663 | 0.168 | 4.548 | −1.522 | 0.436 | 4.548 | | | |
| 3.331 | −1.401 | 6.064 | −1.745 | 0.212 | 6.064 | −1.284 | 0.296 | 6.064 |
| 3.327 | −1.410 | 6.064 | −1.886 | 0.307 | 6.064 | −1.116 | 0.213 | 6.064 |
| 3.317 | −1.420 | 6.064 | −2.020 | 0.401 | 6.064 | −0.941 | 0.130 | 6.064 |
| 3.300 | −1.423 | 6.064 | −2.148 | 0.495 | 6.064 | −0.759 | 0.046 | 6.064 |
| 3.280 | −1.418 | 6.064 | −2.262 | 0.583 | 6.064 | −0.575 | −0.035 | 6.064 |
| 3.253 | −1.413 | 6.064 | −2.364 | 0.664 | 6.064 | −0.391 | −0.114 | 6.064 |

TABLE 3R-continued

| X-LOC | Y-LOC | Z-LOC | X-LOC | Y-LOC | Z-LOC | X-LOC | Y-LOC | Z-LOC |
|---|---|---|---|---|---|---|---|---|
| 3.219 | −1.405 | 6.064 | −2.454 | 0.739 | 6.064 | −0.205 | −0.191 | 6.064 |
| 3.175 | −1.396 | 6.064 | −2.532 | 0.807 | 6.064 | −0.018 | −0.265 | 6.064 |
| 3.122 | −1.386 | 6.064 | −2.599 | 0.866 | 6.064 | 0.169 | −0.338 | 6.064 |
| 3.059 | −1.373 | 6.064 | −2.654 | 0.918 | 6.064 | 0.357 | −0.409 | 6.064 |
| 2.985 | −1.359 | 6.064 | −2.701 | 0.963 | 6.064 | 0.546 | −0.479 | 6.064 |
| 2.898 | −1.342 | 6.064 | −2.739 | 1.001 | 6.064 | 0.734 | −0.548 | 6.064 |
| 2.797 | −1.324 | 6.064 | −2.769 | 1.034 | 6.064 | 0.924 | −0.616 | 6.064 |
| 2.682 | −1.303 | 6.064 | −2.793 | 1.061 | 6.064 | 1.113 | −0.682 | 6.064 |
| 2.554 | −1.279 | 6.064 | −2.809 | 1.083 | 6.064 | 1.304 | −0.747 | 6.064 |
| 2.413 | −1.254 | 6.064 | −2.819 | 1.101 | 6.064 | 1.488 | −0.809 | 6.064 |
| 2.258 | −1.225 | 6.064 | −2.825 | 1.117 | 6.064 | 1.666 | −0.868 | 6.064 |
| 2.097 | −1.195 | 6.064 | −2.825 | 1.131 | 6.064 | 1.838 | −0.923 | 6.064 |
| 1.929 | −1.163 | 6.064 | −2.820 | 1.140 | 6.064 | 2.004 | −0.976 | 6.064 |
| 1.754 | −1.128 | 6.064 | −2.812 | 1.145 | 6.064 | 2.164 | −1.027 | 6.064 |
| 1.573 | −1.090 | 6.064 | −2.798 | 1.146 | 6.064 | 2.317 | −1.075 | 6.064 |
| 1.386 | −1.050 | 6.064 | −2.782 | 1.142 | 6.064 | 2.465 | −1.121 | 6.064 |
| 1.193 | −1.005 | 6.064 | −2.763 | 1.134 | 6.064 | 2.599 | −1.162 | 6.064 |
| 0.994 | −0.956 | 6.064 | −2.739 | 1.123 | 6.064 | 2.721 | −1.199 | 6.064 |
| 0.795 | −0.903 | 6.064 | −2.708 | 1.106 | 6.064 | 2.830 | −1.232 | 6.064 |
| 0.598 | −0.848 | 6.064 | −2.671 | 1.085 | 6.064 | 2.927 | −1.260 | 6.064 |
| 0.401 | −0.788 | 6.064 | −2.625 | 1.057 | 6.064 | 3.010 | −1.284 | 6.064 |
| 0.206 | −0.725 | 6.064 | −2.572 | 1.024 | 6.064 | 3.081 | −1.305 | 6.064 |
| 0.013 | −0.658 | 6.064 | −2.509 | 0.986 | 6.064 | 3.142 | −1.321 | 6.064 |
| −0.178 | −0.586 | 6.064 | −2.434 | 0.941 | 6.064 | 3.193 | −1.335 | 6.064 |
| −0.367 | −0.511 | 6.064 | −2.348 | 0.888 | 6.064 | 3.235 | −1.347 | 6.064 |
| −0.554 | −0.431 | 6.064 | −2.251 | 0.829 | 6.064 | 3.269 | −1.355 | 6.064 |
| −0.739 | −0.347 | 6.064 | −2.141 | 0.764 | 6.064 | 3.295 | −1.362 | 6.064 |
| −0.922 | −0.259 | 6.064 | −2.020 | 0.693 | 6.064 | 3.314 | −1.368 | 6.064 |
| −1.102 | −0.166 | 6.064 | −1.886 | 0.616 | 6.064 | 3.327 | −1.378 | 6.064 |
| −1.274 | −0.072 | 6.064 | −1.746 | 0.538 | 6.064 | 3.331 | −1.391 | 6.064 |
| −1.439 | 0.022 | 6.064 | −1.599 | 0.458 | 6.064 | | | |
| −1.596 | 0.117 | 6.064 | −1.445 | 0.377 | 6.064 | | | |
| 3.247 | −1.740 | 7.581 | −1.674 | 0.221 | 7.581 | −1.226 | 0.268 | 7.581 |
| 3.242 | −1.749 | 7.581 | −1.812 | 0.321 | 7.581 | −1.063 | 0.177 | 7.581 |
| 3.231 | −1.757 | 7.581 | −1.942 | 0.420 | 7.581 | −0.893 | 0.084 | 7.581 |
| 3.214 | −1.756 | 7.581 | −2.065 | 0.517 | 7.581 | −0.716 | −0.010 | 7.581 |
| 3.195 | −1.750 | 7.581 | −2.176 | 0.608 | 7.581 | −0.539 | −0.102 | 7.581 |
| 3.169 | −1.742 | 7.581 | −2.275 | 0.693 | 7.581 | −0.360 | −0.192 | 7.581 |
| 3.135 | −1.732 | 7.581 | −2.362 | 0.770 | 7.581 | −0.180 | −0.281 | 7.581 |
| 3.092 | −1.719 | 7.581 | −2.437 | 0.839 | 7.581 | 0.000 | −0.368 | 7.581 |
| 3.041 | −1.704 | 7.581 | −2.502 | 0.900 | 7.581 | 0.181 | −0.454 | 7.581 |
| 2.979 | −1.686 | 7.581 | −2.555 | 0.952 | 7.581 | 0.363 | −0.538 | 7.581 |
| 2.907 | −1.666 | 7.581 | −2.600 | 0.998 | 7.581 | 0.545 | −0.621 | 7.581 |
| 2.822 | −1.642 | 7.581 | −2.638 | 1.037 | 7.581 | 0.728 | −0.702 | 7.581 |
| 2.724 | −1.615 | 7.581 | −2.668 | 1.070 | 7.581 | 0.911 | −0.783 | 7.581 |
| 2.613 | −1.584 | 7.581 | −2.690 | 1.098 | 7.581 | 1.095 | −0.862 | 7.581 |
| 2.488 | −1.550 | 7.581 | −2.706 | 1.120 | 7.581 | 1.279 | −0.940 | 7.581 |
| 2.350 | −1.512 | 7.581 | −2.716 | 1.137 | 7.581 | 1.458 | −1.015 | 7.581 |
| 2.200 | −1.471 | 7.581 | −2.722 | 1.153 | 7.581 | 1.630 | −1.087 | 7.581 |
| 2.042 | −1.427 | 7.581 | −2.723 | 1.167 | 7.581 | 1.797 | −1.155 | 7.581 |
| 1.879 | −1.381 | 7.581 | −2.720 | 1.176 | 7.581 | 1.958 | −1.221 | 7.581 |
| 1.709 | −1.332 | 7.581 | −2.710 | 1.180 | 7.581 | 2.113 | −1.283 | 7.581 |
| 1.533 | −1.280 | 7.581 | −2.697 | 1.179 | 7.581 | 2.262 | −1.342 | 7.581 |
| 1.351 | −1.224 | 7.581 | −2.681 | 1.174 | 7.581 | 2.405 | −1.398 | 7.581 |
| 1.163 | −1.165 | 7.581 | −2.663 | 1.166 | 7.581 | 2.535 | −1.449 | 7.581 |
| 0.969 | −1.101 | 7.581 | −2.639 | 1.153 | 7.581 | 2.653 | −1.495 | 7.581 |
| 0.777 | −1.034 | 7.581 | −2.609 | 1.136 | 7.581 | 2.759 | −1.536 | 7.581 |
| 0.586 | −0.965 | 7.581 | −2.573 | 1.113 | 7.581 | 2.853 | −1.572 | 7.581 |
| 0.396 | −0.892 | 7.581 | −2.528 | 1.084 | 7.581 | 2.934 | −1.602 | 7.581 |
| 0.209 | −0.816 | 7.581 | −2.476 | 1.049 | 7.581 | 3.003 | −1.627 | 7.581 |
| 0.023 | −0.737 | 7.581 | −2.415 | 1.008 | 7.581 | 3.062 | −1.649 | 7.581 |
| −0.161 | −0.654 | 7.581 | −2.343 | 0.960 | 7.581 | 3.112 | −1.667 | 7.581 |
| −0.343 | −0.567 | 7.581 | −2.259 | 0.905 | 7.581 | 3.153 | −1.681 | 7.581 |
| −0.523 | −0.477 | 7.581 | −2.164 | 0.843 | 7.581 | 3.185 | −1.693 | 7.581 |
| −0.701 | −0.383 | 7.581 | −2.058 | 0.774 | 7.581 | 3.211 | −1.701 | 7.581 |
| −0.877 | −0.285 | 7.581 | −1.940 | 0.698 | 7.581 | 3.230 | −1.708 | 7.581 |
| −1.052 | −0.184 | 7.581 | −1.810 | 0.616 | 7.581 | 3.243 | −1.717 | 7.581 |
| −1.219 | −0.082 | 7.581 | −1.674 | 0.532 | 7.581 | 3.248 | −1.730 | 7.581 |
| −1.378 | 0.019 | 7.581 | −1.531 | 0.446 | 7.581 | | | |
| −1.530 | 0.120 | 7.581 | −1.382 | 0.358 | 7.581 | | | |
| 3.137 | −1.997 | 9.097 | −1.622 | 0.269 | 9.097 | −1.201 | 0.248 | 9.097 |
| 3.132 | −2.005 | 9.097 | −1.755 | 0.372 | 9.097 | −1.044 | 0.148 | 9.097 |
| 3.120 | −2.011 | 9.097 | −1.881 | 0.473 | 9.097 | −0.880 | 0.046 | 9.097 |
| 3.103 | −2.008 | 9.097 | −2.000 | 0.572 | 9.097 | −0.709 | −0.057 | 9.097 |
| 3.084 | −2.001 | 9.097 | −2.108 | 0.663 | 9.097 | −0.538 | −0.159 | 9.097 |
| 3.059 | −1.991 | 9.097 | −2.203 | 0.748 | 9.097 | −0.365 | −0.259 | 9.097 |
| 3.026 | −1.979 | 9.097 | −2.288 | 0.825 | 9.097 | −0.192 | −0.357 | 9.097 |

TABLE 3R-continued

| X-LOC | Y-LOC | Z-LOC | X-LOC | Y-LOC | Z-LOC | X-LOC | Y-LOC | Z-LOC |
|---|---|---|---|---|---|---|---|---|
| 2.985 | −1.964 | 9.097 | −2.362 | 0.894 | 9.097 | −0.018 | −0.454 | 9.097 |
| 2.936 | −1.945 | 9.097 | −2.425 | 0.954 | 9.097 | 0.157 | −0.550 | 9.097 |
| 2.876 | −1.924 | 9.097 | −2.477 | 1.006 | 9.097 | 0.333 | −0.644 | 9.097 |
| 2.807 | −1.898 | 9.097 | −2.522 | 1.051 | 9.097 | 0.509 | −0.737 | 9.097 |
| 2.725 | −1.869 | 9.097 | −2.559 | 1.090 | 9.097 | 0.686 | −0.829 | 9.097 |
| 2.630 | −1.835 | 9.097 | −2.588 | 1.122 | 9.097 | 0.864 | −0.920 | 9.097 |
| 2.522 | −1.797 | 9.097 | −2.611 | 1.148 | 9.097 | 1.042 | −1.010 | 9.097 |
| 2.401 | −1.754 | 9.097 | −2.628 | 1.170 | 9.097 | 1.221 | −1.098 | 9.097 |
| 2.268 | −1.707 | 9.097 | −2.639 | 1.186 | 9.097 | 1.394 | −1.183 | 9.097 |
| 2.123 | −1.655 | 9.097 | −2.646 | 1.202 | 9.097 | 1.562 | −1.264 | 9.097 |
| 1.971 | −1.600 | 9.097 | −2.648 | 1.215 | 9.097 | 1.724 | −1.341 | 9.097 |
| 1.814 | −1.542 | 9.097 | −2.645 | 1.224 | 9.097 | 1.880 | −1.414 | 9.097 |
| 1.650 | −1.480 | 9.097 | −2.636 | 1.227 | 9.097 | 2.031 | −1.484 | 9.097 |
| 1.480 | −1.415 | 9.097 | −2.623 | 1.224 | 9.097 | 2.176 | −1.551 | 9.097 |
| 1.305 | −1.346 | 9.097 | −2.607 | 1.217 | 9.097 | 2.315 | −1.614 | 9.097 |
| 1.125 | −1.273 | 9.097 | −2.590 | 1.208 | 9.097 | 2.443 | −1.671 | 9.097 |
| 0.939 | −1.195 | 9.097 | −2.567 | 1.194 | 9.097 | 2.558 | −1.723 | 9.097 |
| 0.754 | −1.115 | 9.097 | −2.538 | 1.175 | 9.097 | 2.661 | −1.769 | 9.097 |
| 0.570 | −1.033 | 9.097 | −2.503 | 1.150 | 9.097 | 2.753 | −1.809 | 9.097 |
| 0.387 | −0.948 | 9.097 | −2.460 | 1.119 | 9.097 | 2.832 | −1.844 | 9.097 |
| 0.206 | −0.860 | 9.097 | −2.410 | 1.083 | 9.097 | 2.899 | −1.873 | 9.097 |
| 0.026 | −0.769 | 9.097 | −2.350 | 1.040 | 9.097 | 2.956 | −1.897 | 9.097 |
| −0.152 | −0.674 | 9.097 | −2.281 | 0.989 | 9.097 | 3.005 | −1.917 | 9.097 |
| −0.329 | −0.577 | 9.097 | −2.200 | 0.930 | 9.097 | 3.045 | −1.934 | 9.097 |
| −0.504 | −0.477 | 9.097 | −2.108 | 0.864 | 9.097 | 3.077 | −1.947 | 9.097 |
| −0.677 | −0.374 | 9.097 | −2.005 | 0.790 | 9.097 | 3.101 | −1.958 | 9.097 |
| −0.849 | −0.268 | 9.097 | −1.891 | 0.710 | 9.097 | 3.120 | −1.965 | 9.097 |
| −1.018 | −0.158 | 9.097 | −1.765 | 0.623 | 9.097 | 3.133 | −1.974 | 9.097 |
| −1.180 | −0.050 | 9.097 | −1.634 | 0.533 | 9.097 | 3.138 | −1.987 | 9.097 |
| −1.335 | 0.058 | 9.097 | −1.496 | 0.440 | 9.097 | | | |
| −1.482 | 0.165 | 9.097 | −1.351 | 0.345 | 9.097 | | | |
| 3.036 | −2.133 | 10.234 | −1.586 | 0.339 | 10.234 | −1.185 | 0.285 | 10.234 |
| 3.030 | −2.141 | 10.234 | −1.716 | 0.444 | 10.234 | −1.032 | 0.180 | 10.234 |
| 3.018 | −2.146 | 10.234 | −1.839 | 0.547 | 10.234 | −0.872 | 0.073 | 10.234 |
| 3.002 | −2.141 | 10.234 | −1.955 | 0.647 | 10.234 | −0.707 | −0.037 | 10.234 |
| 2.983 | −2.133 | 10.234 | −2.060 | 0.740 | 10.234 | −0.540 | −0.145 | 10.234 |
| 2.959 | −2.123 | 10.234 | −2.154 | 0.826 | 10.234 | −0.373 | −0.252 | 10.234 |
| 2.927 | −2.109 | 10.234 | −2.237 | 0.904 | 10.234 | −0.205 | −0.358 | 10.234 |
| 2.887 | −2.093 | 10.234 | −2.310 | 0.973 | 10.234 | −0.036 | −0.462 | 10.234 |
| 2.838 | −2.072 | 10.234 | −2.372 | 1.034 | 10.234 | 0.134 | −0.565 | 10.234 |
| 2.780 | −2.048 | 10.234 | −2.424 | 1.086 | 10.234 | 0.305 | −0.667 | 10.234 |
| 2.712 | −2.020 | 10.234 | −2.467 | 1.131 | 10.234 | 0.476 | −0.767 | 10.234 |
| 2.632 | −1.987 | 10.234 | −2.504 | 1.169 | 10.234 | 0.648 | −0.866 | 10.234 |
| 2.539 | −1.949 | 10.234 | −2.533 | 1.201 | 10.234 | 0.821 | −0.964 | 10.234 |
| 2.434 | −1.906 | 10.234 | −2.556 | 1.228 | 10.234 | 0.994 | −1.061 | 10.234 |
| 2.316 | −1.858 | 10.234 | −2.573 | 1.249 | 10.234 | 1.168 | −1.157 | 10.234 |
| 2.187 | −1.805 | 10.234 | −2.584 | 1.265 | 10.234 | 1.337 | −1.249 | 10.234 |
| 2.045 | −1.745 | 10.234 | −2.592 | 1.280 | 10.234 | 1.500 | −1.336 | 10.234 |
| 1.897 | −1.683 | 10.234 | −2.595 | 1.293 | 10.234 | 1.658 | −1.420 | 10.234 |
| 1.744 | −1.617 | 10.234 | −2.592 | 1.302 | 10.234 | 1.811 | −1.500 | 10.234 |
| 1.584 | −1.548 | 10.234 | −2.583 | 1.304 | 10.234 | 1.958 | −1.576 | 10.234 |
| 1.420 | −1.475 | 10.234 | −2.570 | 1.300 | 10.234 | 2.099 | −1.648 | 10.234 |
| 1.249 | −1.397 | 10.234 | −2.555 | 1.293 | 10.234 | 2.235 | −1.718 | 10.234 |
| 1.074 | −1.315 | 10.234 | −2.538 | 1.283 | 10.234 | 2.359 | −1.780 | 10.234 |
| 0.893 | −1.229 | 10.234 | −2.516 | 1.268 | 10.234 | 2.471 | −1.837 | 10.234 |
| 0.714 | −1.139 | 10.234 | −2.488 | 1.248 | 10.234 | 2.572 | −1.887 | 10.234 |
| 0.536 | −1.048 | 10.234 | −2.453 | 1.222 | 10.234 | 2.661 | −1.931 | 10.234 |
| 0.359 | −0.954 | 10.234 | −2.412 | 1.191 | 10.234 | 2.738 | −1.969 | 10.234 |
| 0.184 | −0.857 | 10.234 | −2.362 | 1.153 | 10.234 | 2.804 | −2.000 | 10.234 |
| 0.010 | −0.757 | 10.234 | −2.305 | 1.108 | 10.234 | 2.860 | −2.027 | 10.234 |
| −0.162 | −0.655 | 10.234 | −2.237 | 1.055 | 10.234 | 2.907 | −2.049 | 10.234 |
| −0.333 | −0.550 | 10.234 | −2.158 | 0.995 | 10.234 | 2.946 | −2.068 | 10.234 |
| −0.502 | −0.442 | 10.234 | −2.068 | 0.927 | 10.234 | 2.978 | −2.082 | 10.234 |
| −0.670 | −0.332 | 10.234 | −1.968 | 0.851 | 10.234 | 3.002 | −2.093 | 10.234 |
| −0.836 | −0.220 | 10.234 | −1.857 | 0.767 | 10.234 | 3.020 | −2.102 | 10.234 |
| −1.000 | −0.105 | 10.234 | −1.735 | 0.677 | 10.234 | 3.033 | −2.111 | 10.234 |
| −1.157 | 0.009 | 10.234 | −1.606 | 0.583 | 10.234 | 3.038 | −2.123 | 10.234 |
| −1.307 | 0.121 | 10.234 | −1.472 | 0.487 | 10.234 | | | |
| −1.450 | 0.231 | 10.234 | −1.331 | 0.387 | 10.234 | | | |
| 2.901 | −2.199 | 11.371 | −1.563 | 0.469 | 11.371 | −1.171 | 0.395 | 11.371 |
| 2.895 | −2.207 | 11.371 | −1.687 | 0.580 | 11.371 | −1.024 | 0.284 | 11.371 |
| 2.883 | −2.210 | 11.371 | −1.804 | 0.687 | 11.371 | −0.871 | 0.170 | 11.371 |
| 2.867 | −2.205 | 11.371 | −1.915 | 0.792 | 11.371 | −0.713 | 0.053 | 11.371 |
| 2.849 | −2.196 | 11.371 | −2.015 | 0.889 | 11.371 | −0.553 | −0.062 | 11.371 |
| 2.825 | −2.185 | 11.371 | −2.104 | 0.978 | 11.371 | −0.392 | −0.176 | 11.371 |
| 2.794 | −2.170 | 11.371 | −2.183 | 1.059 | 11.371 | −0.230 | −0.289 | 11.371 |
| 2.755 | −2.152 | 11.371 | −2.252 | 1.131 | 11.371 | −0.068 | −0.401 | 11.371 |

TABLE 3R-continued

| X-LOC | Y-LOC | Z-LOC | X-LOC | Y-LOC | Z-LOC | X-LOC | Y-LOC | Z-LOC |
|---|---|---|---|---|---|---|---|---|
| 2.707 | −2.130 | 11.371 | −2.311 | 1.194 | 11.371 | 0.095 | −0.511 | 11.371 |
| 2.651 | −2.104 | 11.371 | −2.360 | 1.248 | 11.371 | 0.260 | −0.620 | 11.371 |
| 2.585 | −2.073 | 11.371 | −2.401 | 1.294 | 11.371 | 0.424 | −0.728 | 11.371 |
| 2.506 | −2.037 | 11.371 | −2.436 | 1.334 | 11.371 | 0.590 | −0.835 | 11.371 |
| 2.416 | −1.996 | 11.371 | −2.463 | 1.367 | 11.371 | 0.757 | −0.941 | 11.371 |
| 2.313 | −1.949 | 11.371 | −2.485 | 1.394 | 11.371 | 0.924 | −1.045 | 11.371 |
| 2.198 | −1.897 | 11.371 | −2.501 | 1.416 | 11.371 | 1.092 | −1.149 | 11.371 |
| 2.072 | −1.839 | 11.371 | −2.511 | 1.432 | 11.371 | 1.255 | −1.247 | 11.371 |
| 1.933 | −1.775 | 11.371 | −2.519 | 1.447 | 11.371 | 1.413 | −1.342 | 11.371 |
| 1.789 | −1.707 | 11.371 | −2.522 | 1.460 | 11.371 | 1.566 | −1.432 | 11.371 |
| 1.640 | −1.636 | 11.371 | −2.520 | 1.469 | 11.371 | 1.713 | −1.518 | 11.371 |
| 1.485 | −1.561 | 11.371 | −2.510 | 1.471 | 11.371 | 1.856 | −1.600 | 11.371 |
| 1.324 | −1.481 | 11.371 | −2.498 | 1.466 | 11.371 | 1.993 | −1.678 | 11.371 |
| 1.159 | −1.396 | 11.371 | −2.484 | 1.457 | 11.371 | 2.124 | −1.752 | 11.371 |
| 0.989 | −1.307 | 11.371 | −2.467 | 1.446 | 11.371 | 2.245 | −1.820 | 11.371 |
| 0.814 | −1.212 | 11.371 | −2.446 | 1.431 | 11.371 | 2.354 | −1.881 | 11.371 |
| 0.641 | −1.114 | 11.371 | −2.419 | 1.410 | 11.371 | 2.452 | −1.935 | 11.371 |
| 0.469 | −1.014 | 11.371 | −2.386 | 1.383 | 11.371 | 2.538 | −1.983 | 11.371 |
| 0.299 | −0.912 | 11.371 | −2.346 | 1.350 | 11.371 | 2.613 | −2.024 | 11.371 |
| 0.130 | −0.806 | 11.371 | −2.299 | 1.310 | 11.371 | 2.677 | −2.058 | 11.371 |
| −0.037 | −0.698 | 11.371 | −2.244 | 1.263 | 11.371 | 2.731 | −2.087 | 11.371 |
| −0.202 | −0.588 | 11.371 | −2.178 | 1.208 | 11.371 | 2.777 | −2.111 | 11.371 |
| −0.366 | −0.475 | 11.371 | −2.103 | 1.144 | 11.371 | 2.815 | −2.131 | 11.371 |
| −0.528 | −0.359 | 11.371 | −2.017 | 1.073 | 11.371 | 2.845 | −2.147 | 11.371 |
| −0.688 | −0.241 | 11.371 | −1.921 | 0.993 | 11.371 | 2.869 | −2.159 | 11.371 |
| −0.847 | −0.121 | 11.371 | −1.815 | 0.905 | 11.371 | 2.886 | −2.168 | 11.371 |
| −1.004 | 0.001 | 11.371 | −1.698 | 0.809 | 11.371 | 2.899 | −2.177 | 11.371 |
| −1.154 | 0.121 | 11.371 | −1.575 | 0.710 | 11.371 | 2.903 | −2.189 | 11.371 |
| −1.297 | 0.240 | 11.371 | −1.446 | 0.608 | 11.371 | | | |
| −1.433 | 0.355 | 11.371 | −1.311 | 0.503 | 11.371 | | | |
| 2.799 | −2.195 | 12.129 | −1.552 | 0.629 | 12.129 | −1.163 | 0.541 | 12.129 |
| 2.793 | −2.203 | 12.129 | −1.670 | 0.744 | 12.129 | −1.021 | 0.425 | 12.129 |
| 2.780 | −2.206 | 12.129 | −1.783 | 0.857 | 12.129 | −0.873 | 0.306 | 12.129 |
| 2.765 | −2.200 | 12.129 | −1.889 | 0.966 | 12.129 | −0.718 | 0.184 | 12.129 |
| 2.747 | −2.191 | 12.129 | −1.984 | 1.067 | 12.129 | −0.563 | 0.065 | 12.129 |
| 2.724 | −2.179 | 12.129 | −2.069 | 1.159 | 12.129 | −0.406 | −0.054 | 12.129 |
| 2.693 | −2.164 | 12.129 | −2.145 | 1.243 | 12.129 | −0.248 | −0.172 | 12.129 |
| 2.654 | −2.144 | 12.129 | −2.210 | 1.317 | 12.129 | −0.090 | −0.288 | 12.129 |
| 2.608 | −2.121 | 12.129 | −2.266 | 1.383 | 12.129 | 0.069 | −0.403 | 12.129 |
| 2.552 | −2.093 | 12.129 | −2.313 | 1.438 | 12.129 | 0.229 | −0.518 | 12.129 |
| 2.487 | −2.061 | 12.129 | −2.352 | 1.486 | 12.129 | 0.389 | −0.632 | 12.129 |
| 2.410 | −2.022 | 12.129 | −2.385 | 1.527 | 12.129 | 0.550 | −0.745 | 12.129 |
| 2.321 | −1.978 | 12.129 | −2.411 | 1.562 | 12.129 | 0.711 | −0.857 | 12.129 |
| 2.221 | −1.928 | 12.129 | −2.431 | 1.589 | 12.129 | 0.873 | −0.969 | 12.129 |
| 2.108 | −1.872 | 12.129 | −2.446 | 1.611 | 12.129 | 1.036 | −1.079 | 12.129 |
| 1.984 | −1.809 | 12.129 | −2.456 | 1.628 | 12.129 | 1.194 | −1.185 | 12.129 |
| 1.849 | −1.740 | 12.129 | −2.463 | 1.643 | 12.129 | 1.348 | −1.285 | 12.129 |
| 1.708 | −1.667 | 12.129 | −2.466 | 1.656 | 12.129 | 1.496 | −1.382 | 12.129 |
| 1.562 | −1.590 | 12.129 | −2.464 | 1.665 | 12.129 | 1.639 | −1.474 | 12.129 |
| 1.410 | −1.508 | 12.129 | −2.454 | 1.666 | 12.129 | 1.778 | −1.561 | 12.129 |
| 1.254 | −1.422 | 12.129 | −2.442 | 1.661 | 12.129 | 1.911 | −1.645 | 12.129 |
| 1.093 | −1.331 | 12.129 | −2.429 | 1.652 | 12.129 | 2.039 | −1.724 | 12.129 |
| 0.927 | −1.235 | 12.129 | −2.413 | 1.640 | 12.129 | 2.157 | −1.796 | 12.129 |
| 0.757 | −1.132 | 12.129 | −2.392 | 1.624 | 12.129 | 2.263 | −1.861 | 12.129 |
| 0.588 | −1.028 | 12.129 | −2.366 | 1.602 | 12.129 | 2.358 | −1.919 | 12.129 |
| 0.421 | −0.921 | 12.129 | −2.334 | 1.573 | 12.129 | 2.443 | −1.969 | 12.129 |
| 0.256 | −0.812 | 12.129 | −2.296 | 1.539 | 12.129 | 2.516 | −2.012 | 12.129 |
| 0.092 | −0.701 | 12.129 | −2.250 | 1.497 | 12.129 | 2.579 | −2.049 | 12.129 |
| −0.071 | −0.588 | 12.129 | −2.197 | 1.449 | 12.129 | 2.632 | −2.079 | 12.129 |
| −0.232 | −0.472 | 12.129 | −2.134 | 1.391 | 12.129 | 2.677 | −2.105 | 12.129 |
| −0.392 | −0.354 | 12.129 | −2.062 | 1.325 | 12.129 | 2.714 | −2.126 | 12.129 |
| −0.550 | −0.234 | 12.129 | −1.980 | 1.249 | 12.129 | 2.744 | −2.142 | 12.129 |
| −0.706 | −0.111 | 12.129 | −1.887 | 1.166 | 12.129 | 2.767 | −2.155 | 12.129 |
| −0.860 | 0.014 | 12.129 | −1.785 | 1.074 | 12.129 | 2.784 | −2.164 | 12.129 |
| −1.012 | 0.141 | 12.129 | −1.672 | 0.974 | 12.129 | 2.798 | −2.174 | 12.129 |
| −1.157 | 0.266 | 12.129 | −1.553 | 0.871 | 12.129 | 2.802 | −2.186 | 12.129 |
| −1.296 | 0.390 | 12.129 | −1.429 | 0.764 | 12.129 | | | |
| −1.427 | 0.510 | 12.129 | −1.299 | 0.654 | 12.129 | | | |

The coordinate values given in TABLE 4R below provide the nominal profile envelope for an exemplary forth stage rotor.

TABLE 4R

| X-LOC | Y-LOC | Z-LOC | X-LOC | Y-LOC | Z-LOC | X-LOC | Y-LOC | Z-LOC |
|---|---|---|---|---|---|---|---|---|
| 2.716 | 0.196 | 0.000 | −1.316 | −0.266 | 0.000 | −0.895 | 0.022 | 0.000 |
| 2.717 | 0.188 | 0.000 | −1.435 | −0.204 | 0.000 | −0.759 | −0.002 | 0.000 |
| 2.715 | 0.178 | 0.000 | −1.544 | −0.139 | 0.000 | −0.617 | −0.022 | 0.000 |
| 2.706 | 0.168 | 0.000 | −1.645 | −0.071 | 0.000 | −0.469 | −0.040 | 0.000 |
| 2.692 | 0.161 | 0.000 | −1.738 | 0.000 | 0.000 | −0.322 | −0.054 | 0.000 |
| 2.671 | 0.155 | 0.000 | −1.819 | 0.069 | 0.000 | −0.173 | −0.065 | 0.000 |
| 2.645 | 0.146 | 0.000 | −1.889 | 0.137 | 0.000 | −0.025 | −0.073 | 0.000 |
| 2.612 | 0.136 | 0.000 | −1.948 | 0.200 | 0.000 | 0.124 | −0.079 | 0.000 |
| 2.572 | 0.123 | 0.000 | −1.999 | 0.262 | 0.000 | 0.272 | −0.081 | 0.000 |
| 2.525 | 0.108 | 0.000 | −2.041 | 0.319 | 0.000 | 0.421 | −0.081 | 0.000 |
| 2.469 | 0.089 | 0.000 | −2.070 | 0.364 | 0.000 | 0.569 | −0.079 | 0.000 |
| 2.404 | 0.067 | 0.000 | −2.090 | 0.403 | 0.000 | 0.717 | −0.073 | 0.000 |
| 2.328 | 0.042 | 0.000 | −2.103 | 0.432 | 0.000 | 0.865 | −0.064 | 0.000 |
| 2.243 | 0.012 | 0.000 | −2.109 | 0.456 | 0.000 | 1.013 | −0.053 | 0.000 |
| 2.148 | −0.022 | 0.000 | −2.109 | 0.469 | 0.000 | 1.161 | −0.039 | 0.000 |
| 2.042 | −0.059 | 0.000 | −2.107 | 0.478 | 0.000 | 1.304 | −0.024 | 0.000 |
| 1.927 | −0.099 | 0.000 | −2.105 | 0.482 | 0.000 | 1.442 | −0.007 | 0.000 |
| 1.806 | −0.141 | 0.000 | −2.104 | 0.483 | 0.000 | 1.574 | 0.010 | 0.000 |
| 1.680 | −0.183 | 0.000 | −2.103 | 0.484 | 0.000 | 1.702 | 0.029 | 0.000 |
| 1.549 | −0.226 | 0.000 | −2.102 | 0.485 | 0.000 | 1.825 | 0.047 | 0.000 |
| 1.412 | −0.269 | 0.000 | −2.101 | 0.486 | 0.000 | 1.942 | 0.067 | 0.000 |
| 1.269 | −0.311 | 0.000 | −2.097 | 0.487 | 0.000 | 2.054 | 0.086 | 0.000 |
| 1.120 | −0.352 | 0.000 | −2.089 | 0.488 | 0.000 | 2.157 | 0.104 | 0.000 |
| 0.966 | −0.390 | 0.000 | −2.077 | 0.487 | 0.000 | 2.250 | 0.120 | 0.000 |
| 0.812 | −0.424 | 0.000 | −2.055 | 0.479 | 0.000 | 2.333 | 0.136 | 0.000 |
| 0.657 | −0.453 | 0.000 | −2.028 | 0.467 | 0.000 | 2.405 | 0.151 | 0.000 |
| 0.501 | −0.478 | 0.000 | −1.993 | 0.447 | 0.000 | 2.468 | 0.165 | 0.000 |
| 0.345 | −0.497 | 0.000 | −1.950 | 0.422 | 0.000 | 2.522 | 0.177 | 0.000 |
| 0.188 | −0.510 | 0.000 | −1.894 | 0.389 | 0.000 | 2.567 | 0.187 | 0.000 |
| 0.031 | −0.518 | 0.000 | −1.830 | 0.352 | 0.000 | 2.605 | 0.196 | 0.000 |
| −0.127 | −0.520 | 0.000 | −1.760 | 0.314 | 0.000 | 2.637 | 0.204 | 0.000 |
| −0.286 | −0.515 | 0.000 | −1.680 | 0.274 | 0.000 | 2.662 | 0.209 | 0.000 |
| −0.446 | −0.503 | 0.000 | −1.590 | 0.233 | 0.000 | 2.681 | 0.214 | 0.000 |
| −0.605 | −0.484 | 0.000 | −1.490 | 0.192 | 0.000 | 2.696 | 0.215 | 0.000 |
| −0.762 | −0.455 | 0.000 | −1.383 | 0.153 | 0.000 | 2.707 | 0.210 | 0.000 |
| −0.912 | −0.418 | 0.000 | −1.271 | 0.116 | 0.000 | 2.713 | 0.203 | 0.000 |
| −1.054 | −0.374 | 0.000 | −1.151 | 0.082 | 0.000 | | | |
| −1.189 | −0.323 | 0.000 | −1.026 | 0.050 | 0.000 | | | |
| 2.682 | 0.012 | 0.673 | −1.276 | −0.208 | 0.673 | −0.896 | 0.067 | 0.673 |
| 2.683 | 0.005 | 0.673 | −1.394 | −0.159 | 0.673 | −0.761 | 0.043 | 0.673 |
| 2.680 | −0.005 | 0.673 | −1.506 | −0.105 | 0.673 | −0.621 | 0.021 | 0.673 |
| 2.671 | −0.015 | 0.673 | −1.610 | −0.049 | 0.673 | −0.476 | 0.000 | 0.673 |
| 2.657 | −0.020 | 0.673 | −1.707 | 0.009 | 0.673 | −0.330 | −0.019 | 0.673 |
| 2.637 | −0.025 | 0.673 | −1.794 | 0.066 | 0.673 | −0.185 | −0.036 | 0.673 |
| 2.611 | −0.031 | 0.673 | −1.869 | 0.121 | 0.673 | −0.038 | −0.051 | 0.673 |
| 2.579 | −0.039 | 0.673 | −1.934 | 0.173 | 0.673 | 0.108 | −0.064 | 0.673 |
| 2.539 | −0.048 | 0.673 | −1.992 | 0.224 | 0.673 | 0.254 | −0.075 | 0.673 |
| 2.493 | −0.060 | 0.673 | −2.040 | 0.272 | 0.673 | 0.400 | −0.084 | 0.673 |
| 2.438 | −0.073 | 0.673 | −2.075 | 0.311 | 0.673 | 0.547 | −0.091 | 0.673 |
| 2.373 | −0.088 | 0.673 | −2.100 | 0.344 | 0.673 | 0.693 | −0.095 | 0.673 |
| 2.298 | −0.106 | 0.673 | −2.116 | 0.370 | 0.673 | 0.840 | −0.098 | 0.673 |
| 2.214 | −0.127 | 0.673 | −2.125 | 0.392 | 0.673 | 0.987 | −0.099 | 0.673 |
| 2.119 | −0.150 | 0.673 | −2.128 | 0.405 | 0.673 | 1.133 | −0.097 | 0.673 |
| 2.014 | −0.176 | 0.673 | −2.127 | 0.413 | 0.673 | 1.275 | −0.094 | 0.673 |
| 1.900 | −0.202 | 0.673 | −2.126 | 0.417 | 0.673 | 1.412 | −0.089 | 0.673 |
| 1.780 | −0.230 | 0.673 | −2.124 | 0.418 | 0.673 | 1.544 | −0.083 | 0.673 |
| 1.655 | −0.257 | 0.673 | −2.124 | 0.419 | 0.673 | 1.671 | −0.076 | 0.673 |
| 1.525 | −0.285 | 0.673 | −2.123 | 0.420 | 0.673 | 1.793 | −0.068 | 0.673 |
| 1.389 | −0.312 | 0.673 | −2.122 | 0.422 | 0.673 | 1.911 | −0.059 | 0.673 |
| 1.249 | −0.338 | 0.673 | −2.119 | 0.424 | 0.673 | 2.023 | −0.050 | 0.673 |
| 1.103 | −0.362 | 0.673 | −2.111 | 0.427 | 0.673 | 2.125 | −0.040 | 0.673 |
| 0.951 | −0.385 | 0.673 | −2.099 | 0.429 | 0.673 | 2.218 | −0.031 | 0.673 |
| 0.800 | −0.404 | 0.673 | −2.077 | 0.427 | 0.673 | 2.300 | −0.021 | 0.673 |
| 0.648 | −0.420 | 0.673 | −2.048 | 0.420 | 0.673 | 2.373 | −0.012 | 0.673 |
| 0.495 | −0.432 | 0.673 | −2.011 | 0.409 | 0.673 | 2.436 | −0.003 | 0.673 |
| 0.342 | −0.440 | 0.673 | −1.965 | 0.392 | 0.673 | 2.489 | 0.006 | 0.673 |
| 0.188 | −0.444 | 0.673 | −1.906 | 0.368 | 0.673 | 2.535 | 0.013 | 0.673 |
| 0.034 | −0.444 | 0.673 | −1.838 | 0.340 | 0.673 | 2.573 | 0.019 | 0.673 |
| −0.121 | −0.439 | 0.673 | −1.765 | 0.311 | 0.673 | 2.604 | 0.024 | 0.673 |
| −0.275 | −0.429 | 0.673 | −1.683 | 0.280 | 0.673 | 2.629 | 0.029 | 0.673 |
| −0.428 | −0.414 | 0.673 | −1.591 | 0.247 | 0.673 | 2.649 | 0.032 | 0.673 |
| −0.581 | −0.394 | 0.673 | −1.489 | 0.213 | 0.673 | 2.663 | 0.032 | 0.673 |

TABLE 4R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.732 | −0.367 | 0.673 | −1.381 | 0.181 | 0.673 | 2.674 | 0.027 | 0.673 |
| −0.878 | −0.335 | 0.673 | −1.268 | 0.150 | 0.673 | 2.680 | 0.019 | 0.673 |
| −1.017 | −0.297 | 0.673 | −1.150 | 0.120 | 0.673 | | | |
| −1.150 | −0.255 | 0.673 | −1.026 | 0.093 | 0.673 | | | |
| 2.642 | −0.116 | 1.346 | −1.270 | −0.141 | 1.346 | −0.918 | 0.100 | 1.346 |
| 2.642 | −0.124 | 1.346 | −1.388 | −0.095 | 1.346 | −0.784 | 0.073 | 1.346 |
| 2.638 | −0.133 | 1.346 | −1.500 | −0.047 | 1.346 | −0.646 | 0.047 | 1.346 |
| 2.629 | −0.142 | 1.346 | −1.606 | 0.003 | 1.346 | −0.502 | 0.022 | 1.346 |
| 2.615 | −0.146 | 1.346 | −1.705 | 0.054 | 1.346 | −0.357 | −0.001 | 1.346 |
| 2.595 | −0.149 | 1.346 | −1.793 | 0.105 | 1.346 | −0.213 | −0.022 | 1.346 |
| 2.569 | −0.154 | 1.346 | −1.871 | 0.152 | 1.346 | −0.068 | −0.041 | 1.346 |
| 2.537 | −0.159 | 1.346 | −1.939 | 0.197 | 1.346 | 0.077 | −0.059 | 1.346 |
| 2.497 | −0.166 | 1.346 | −2.001 | 0.242 | 1.346 | 0.222 | −0.075 | 1.346 |
| 2.451 | −0.173 | 1.346 | −2.052 | 0.283 | 1.346 | 0.368 | −0.090 | 1.346 |
| 2.396 | −0.182 | 1.346 | −2.090 | 0.318 | 1.346 | 0.513 | −0.103 | 1.346 |
| 2.331 | −0.193 | 1.346 | −2.118 | 0.347 | 1.346 | 0.659 | −0.114 | 1.346 |
| 2.257 | −0.205 | 1.346 | −2.136 | 0.371 | 1.346 | 0.804 | −0.123 | 1.346 |
| 2.172 | −0.219 | 1.346 | −2.148 | 0.391 | 1.346 | 0.950 | −0.130 | 1.346 |
| 2.078 | −0.235 | 1.346 | −2.151 | 0.403 | 1.346 | 1.096 | −0.136 | 1.346 |
| 1.973 | −0.251 | 1.346 | −2.151 | 0.411 | 1.346 | 1.237 | −0.140 | 1.346 |
| 1.859 | −0.269 | 1.346 | −2.150 | 0.415 | 1.346 | 1.373 | −0.143 | 1.346 |
| 1.739 | −0.287 | 1.346 | −2.150 | 0.417 | 1.346 | 1.505 | −0.144 | 1.346 |
| 1.615 | −0.304 | 1.346 | −2.149 | 0.418 | 1.346 | 1.632 | −0.144 | 1.346 |
| 1.485 | −0.322 | 1.346 | −2.149 | 0.419 | 1.346 | 1.753 | −0.143 | 1.346 |
| 1.350 | −0.338 | 1.346 | −2.147 | 0.421 | 1.346 | 1.870 | −0.141 | 1.346 |
| 1.210 | −0.354 | 1.346 | −2.145 | 0.423 | 1.346 | 1.982 | −0.138 | 1.346 |
| 1.065 | −0.368 | 1.346 | −2.138 | 0.427 | 1.346 | 2.084 | −0.135 | 1.346 |
| 0.915 | −0.380 | 1.346 | −2.126 | 0.430 | 1.346 | 2.177 | −0.131 | 1.346 |
| 0.765 | −0.390 | 1.346 | −2.103 | 0.430 | 1.346 | 2.260 | −0.126 | 1.346 |
| 0.614 | −0.397 | 1.346 | −2.075 | 0.426 | 1.346 | 2.333 | −0.121 | 1.346 |
| 0.463 | −0.400 | 1.346 | −2.036 | 0.417 | 1.346 | 2.396 | −0.116 | 1.346 |
| 0.312 | −0.401 | 1.346 | −1.990 | 0.404 | 1.346 | 2.449 | −0.111 | 1.346 |
| 0.160 | −0.398 | 1.346 | −1.929 | 0.384 | 1.346 | 2.495 | −0.107 | 1.346 |
| 0.009 | −0.391 | 1.346 | −1.860 | 0.361 | 1.346 | 2.533 | −0.103 | 1.346 |
| −0.142 | −0.380 | 1.346 | −1.786 | 0.335 | 1.346 | 2.564 | −0.100 | 1.346 |
| −0.292 | −0.365 | 1.346 | −1.703 | 0.307 | 1.346 | 2.590 | −0.097 | 1.346 |
| −0.441 | −0.346 | 1.346 | −1.611 | 0.277 | 1.346 | 2.609 | −0.095 | 1.346 |
| −0.590 | −0.322 | 1.346 | −1.508 | 0.246 | 1.346 | 2.624 | −0.095 | 1.346 |
| −0.737 | −0.294 | 1.346 | −1.401 | 0.216 | 1.346 | 2.634 | −0.101 | 1.346 |
| −0.879 | −0.261 | 1.346 | −1.288 | 0.186 | 1.346 | 2.640 | −0.109 | 1.346 |
| −1.015 | −0.224 | 1.346 | −1.170 | 0.156 | 1.346 | | | |
| −1.145 | −0.184 | 1.346 | −1.047 | 0.128 | 1.346 | | | |
| 2.559 | −0.336 | 2.693 | −1.308 | −0.040 | 2.693 | −0.974 | 0.125 | 2.693 |
| 2.558 | −0.343 | 2.693 | −1.424 | 0.008 | 2.693 | −0.842 | 0.091 | 2.693 |
| 2.553 | −0.352 | 2.693 | −1.534 | 0.057 | 2.693 | −0.705 | 0.057 | 2.693 |
| 2.544 | −0.360 | 2.693 | −1.637 | 0.108 | 2.693 | −0.563 | 0.024 | 2.693 |
| 2.529 | −0.362 | 2.693 | −1.735 | 0.159 | 2.693 | −0.421 | −0.008 | 2.693 |
| 2.509 | −0.363 | 2.693 | −1.823 | 0.208 | 2.693 | −0.279 | −0.037 | 2.693 |
| 2.483 | −0.365 | 2.693 | −1.900 | 0.254 | 2.693 | −0.136 | −0.066 | 2.693 |
| 2.451 | −0.367 | 2.693 | −1.968 | 0.297 | 2.693 | 0.008 | −0.092 | 2.693 |
| 2.411 | −0.370 | 2.693 | −2.030 | 0.340 | 2.693 | 0.151 | −0.118 | 2.693 |
| 2.365 | −0.373 | 2.693 | −2.083 | 0.378 | 2.693 | 0.295 | −0.141 | 2.693 |
| 2.310 | −0.376 | 2.693 | −2.121 | 0.410 | 2.693 | 0.440 | −0.163 | 2.693 |
| 2.245 | −0.380 | 2.693 | −2.151 | 0.438 | 2.693 | 0.584 | −0.184 | 2.693 |
| 2.170 | −0.385 | 2.693 | −2.171 | 0.461 | 2.693 | 0.728 | −0.203 | 2.693 |
| 2.086 | −0.390 | 2.693 | −2.183 | 0.479 | 2.693 | 0.873 | −0.221 | 2.693 |
| 1.991 | −0.397 | 2.693 | −2.188 | 0.491 | 2.693 | 1.018 | −0.237 | 2.693 |
| 1.887 | −0.403 | 2.693 | −2.189 | 0.499 | 2.693 | 1.158 | −0.251 | 2.693 |
| 1.772 | −0.409 | 2.693 | −2.189 | 0.503 | 2.693 | 1.294 | −0.263 | 2.693 |
| 1.653 | −0.415 | 2.693 | −2.188 | 0.505 | 2.693 | 1.425 | −0.274 | 2.693 |
| 1.528 | −0.420 | 2.693 | −2.187 | 0.505 | 2.693 | 1.551 | −0.284 | 2.693 |
| 1.399 | −0.425 | 2.693 | −2.187 | 0.506 | 2.693 | 1.672 | −0.292 | 2.693 |
| 1.264 | −0.428 | 2.693 | −2.186 | 0.508 | 2.693 | 1.789 | −0.298 | 2.693 |
| 1.125 | −0.430 | 2.693 | −2.182 | 0.510 | 2.693 | 1.900 | −0.304 | 2.693 |
| 0.981 | −0.430 | 2.693 | −2.175 | 0.513 | 2.693 | 2.003 | −0.308 | 2.693 |
| 0.831 | −0.428 | 2.693 | −2.163 | 0.514 | 2.693 | 2.095 | −0.311 | 2.693 |
| 0.682 | −0.424 | 2.693 | −2.141 | 0.513 | 2.693 | 2.178 | −0.313 | 2.693 |
| 0.532 | −0.417 | 2.693 | −2.112 | 0.507 | 2.693 | 2.250 | −0.314 | 2.693 |
| 0.383 | −0.408 | 2.693 | −2.075 | 0.497 | 2.693 | 2.314 | −0.315 | 2.693 |
| 0.234 | −0.395 | 2.693 | −2.029 | 0.481 | 2.693 | 2.367 | −0.314 | 2.693 |
| 0.085 | −0.380 | 2.693 | −1.969 | 0.459 | 2.693 | 2.413 | −0.314 | 2.693 |
| −0.063 | −0.361 | 2.693 | −1.901 | 0.433 | 2.693 | 2.451 | −0.313 | 2.693 |
| −0.210 | −0.339 | 2.693 | −1.829 | 0.405 | 2.693 | 2.483 | −0.313 | 2.693 |
| −0.357 | −0.313 | 2.693 | −1.747 | 0.374 | 2.693 | 2.508 | −0.313 | 2.693 |
| −0.502 | −0.284 | 2.693 | −1.655 | 0.340 | 2.693 | 2.528 | −0.312 | 2.693 |
| −0.647 | −0.251 | 2.693 | −1.555 | 0.304 | 2.693 | 2.542 | −0.314 | 2.693 |
| −0.791 | −0.214 | 2.693 | −1.449 | 0.268 | 2.693 | 2.552 | −0.320 | 2.693 |

TABLE 4R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.928 | −0.174 | 2.693 | −1.338 | 0.232 | 2.693 | 2.557 | −0.329 | 2.693 |
| −1.061 | −0.132 | 2.693 | −1.222 | 0.196 | 2.693 | | | |
| −1.187 | −0.087 | 2.693 | −1.100 | 0.160 | 2.693 | | | |
| 2.480 | −0.587 | 4.039 | −1.341 | −0.005 | 4.039 | −1.011 | 0.119 | 4.039 |
| 2.479 | −0.594 | 4.039 | −1.454 | 0.048 | 4.039 | −0.882 | 0.077 | 4.039 |
| 2.474 | −0.603 | 4.039 | −1.561 | 0.102 | 4.039 | −0.747 | 0.036 | 4.039 |
| 2.463 | −0.609 | 4.039 | −1.662 | 0.156 | 4.039 | −0.608 | −0.005 | 4.039 |
| 2.448 | −0.610 | 4.039 | −1.757 | 0.211 | 4.039 | −0.467 | −0.045 | 4.039 |
| 2.428 | −0.609 | 4.039 | −1.843 | 0.263 | 4.039 | −0.327 | −0.083 | 4.039 |
| 2.403 | −0.609 | 4.039 | −1.918 | 0.311 | 4.039 | −0.186 | −0.120 | 4.039 |
| 2.370 | −0.608 | 4.039 | −1.984 | 0.356 | 4.039 | −0.044 | −0.155 | 4.039 |
| 2.331 | −0.607 | 4.039 | −2.045 | 0.400 | 4.039 | 0.097 | −0.190 | 4.039 |
| 2.285 | −0.606 | 4.039 | −2.096 | 0.439 | 4.039 | 0.239 | −0.223 | 4.039 |
| 2.230 | −0.605 | 4.039 | −2.134 | 0.472 | 4.039 | 0.381 | −0.254 | 4.039 |
| 2.166 | −0.603 | 4.039 | −2.163 | 0.500 | 4.039 | 0.524 | −0.285 | 4.039 |
| 2.091 | −0.602 | 4.039 | −2.183 | 0.522 | 4.039 | 0.667 | −0.314 | 4.039 |
| 2.007 | −0.600 | 4.039 | −2.196 | 0.540 | 4.039 | 0.810 | −0.341 | 4.039 |
| 1.913 | −0.598 | 4.039 | −2.201 | 0.552 | 4.039 | 0.953 | −0.368 | 4.039 |
| 1.808 | −0.596 | 4.039 | −2.203 | 0.560 | 4.039 | 1.092 | −0.392 | 4.039 |
| 1.694 | −0.592 | 4.039 | −2.202 | 0.563 | 4.039 | 1.226 | −0.415 | 4.039 |
| 1.575 | −0.588 | 4.039 | −2.201 | 0.565 | 4.039 | 1.355 | −0.435 | 4.039 |
| 1.452 | −0.583 | 4.039 | −2.201 | 0.566 | 4.039 | 1.480 | −0.454 | 4.039 |
| 1.323 | −0.577 | 4.039 | −2.200 | 0.567 | 4.039 | 1.601 | −0.471 | 4.039 |
| 1.189 | −0.569 | 4.039 | −2.199 | 0.568 | 4.039 | 1.716 | −0.487 | 4.039 |
| 1.051 | −0.560 | 4.039 | −2.196 | 0.571 | 4.039 | 1.827 | −0.501 | 4.039 |
| 0.908 | −0.548 | 4.039 | −2.188 | 0.573 | 4.039 | 1.928 | −0.514 | 4.039 |
| 0.760 | −0.535 | 4.039 | −2.176 | 0.573 | 4.039 | 2.020 | −0.524 | 4.039 |
| 0.613 | −0.519 | 4.039 | −2.154 | 0.569 | 4.039 | 2.102 | −0.533 | 4.039 |
| 0.466 | −0.501 | 4.039 | −2.126 | 0.561 | 4.039 | 2.175 | −0.540 | 4.039 |
| 0.320 | −0.480 | 4.039 | −2.089 | 0.548 | 4.039 | 2.238 | −0.546 | 4.039 |
| 0.174 | −0.457 | 4.039 | −2.044 | 0.530 | 4.039 | 2.291 | −0.550 | 4.039 |
| 0.029 | −0.431 | 4.039 | −1.987 | 0.505 | 4.039 | 2.336 | −0.553 | 4.039 |
| −0.116 | −0.402 | 4.039 | −1.920 | 0.475 | 4.039 | 2.375 | −0.556 | 4.039 |
| −0.260 | −0.370 | 4.039 | −1.849 | 0.443 | 4.039 | 2.406 | −0.558 | 4.039 |
| −0.404 | −0.334 | 4.039 | −1.769 | 0.408 | 4.039 | 2.431 | −0.560 | 4.039 |
| −0.547 | −0.295 | 4.039 | −1.680 | 0.370 | 4.039 | 2.451 | −0.562 | 4.039 |
| −0.689 | −0.253 | 4.039 | −1.581 | 0.328 | 4.039 | 2.465 | −0.564 | 4.039 |
| −0.831 | −0.207 | 4.039 | −1.477 | 0.287 | 4.039 | 2.475 | −0.571 | 4.039 |
| −0.968 | −0.159 | 4.039 | −1.368 | 0.245 | 4.039 | 2.479 | −0.580 | 4.039 |
| −1.098 | −0.109 | 4.039 | −1.254 | 0.203 | 4.039 | | | |
| −1.223 | −0.058 | 4.039 | −1.135 | 0.161 | 4.039 | | | |
| 2.441 | −0.724 | 4.713 | −1.351 | −0.006 | 4.713 | −1.023 | 0.103 | 4.713 |
| 2.439 | −0.731 | 4.713 | −1.461 | 0.050 | 4.713 | −0.895 | 0.058 | 4.713 |
| 2.434 | −0.739 | 4.713 | −1.566 | 0.105 | 4.713 | −0.762 | 0.012 | 4.713 |
| 2.423 | −0.745 | 4.713 | −1.666 | 0.162 | 4.713 | −0.623 | −0.032 | 4.713 |
| 2.408 | −0.745 | 4.713 | −1.760 | 0.218 | 4.713 | −0.484 | −0.076 | 4.713 |
| 2.388 | −0.744 | 4.713 | −1.844 | 0.271 | 4.713 | −0.345 | −0.118 | 4.713 |
| 2.362 | −0.742 | 4.713 | −1.919 | 0.321 | 4.713 | −0.205 | −0.159 | 4.713 |
| 2.330 | −0.740 | 4.713 | −1.985 | 0.367 | 4.713 | −0.065 | −0.199 | 4.713 |
| 2.291 | −0.738 | 4.713 | −2.045 | 0.412 | 4.713 | 0.075 | −0.237 | 4.713 |
| 2.244 | −0.734 | 4.713 | −2.096 | 0.453 | 4.713 | 0.216 | −0.275 | 4.713 |
| 2.190 | −0.731 | 4.713 | −2.134 | 0.486 | 4.713 | 0.357 | −0.311 | 4.713 |
| 2.125 | −0.726 | 4.713 | −2.163 | 0.513 | 4.713 | 0.498 | −0.347 | 4.713 |
| 2.051 | −0.722 | 4.713 | −2.182 | 0.536 | 4.713 | 0.640 | −0.381 | 4.713 |
| 1.967 | −0.717 | 4.713 | −2.195 | 0.554 | 4.713 | 0.782 | −0.413 | 4.713 |
| 1.873 | −0.711 | 4.713 | −2.201 | 0.566 | 4.713 | 0.924 | −0.445 | 4.713 |
| 1.769 | −0.704 | 4.713 | −2.202 | 0.574 | 4.713 | 1.062 | −0.475 | 4.713 |
| 1.655 | −0.696 | 4.713 | −2.202 | 0.578 | 4.713 | 1.195 | −0.502 | 4.713 |
| 1.536 | −0.687 | 4.713 | −2.201 | 0.579 | 4.713 | 1.323 | −0.527 | 4.713 |
| 1.413 | −0.677 | 4.713 | −2.200 | 0.580 | 4.713 | 1.447 | −0.551 | 4.713 |
| 1.284 | −0.666 | 4.713 | −2.200 | 0.581 | 4.713 | 1.567 | −0.573 | 4.713 |
| 1.151 | −0.653 | 4.713 | −2.198 | 0.582 | 4.713 | 1.682 | −0.593 | 4.713 |
| 1.013 | −0.638 | 4.713 | −2.195 | 0.584 | 4.713 | 1.792 | −0.612 | 4.713 |
| 0.870 | −0.621 | 4.713 | −2.187 | 0.586 | 4.713 | 1.892 | −0.628 | 4.713 |
| 0.723 | −0.601 | 4.713 | −2.175 | 0.586 | 4.713 | 1.984 | −0.642 | 4.713 |
| 0.576 | −0.580 | 4.713 | −2.154 | 0.581 | 4.713 | 2.065 | −0.655 | 4.713 |
| 0.429 | −0.556 | 4.713 | −2.126 | 0.573 | 4.713 | 2.137 | −0.665 | 4.713 |
| 0.282 | −0.529 | 4.713 | −2.090 | 0.559 | 4.713 | 2.200 | −0.673 | 4.713 |
| 0.136 | −0.501 | 4.713 | −2.045 | 0.539 | 4.713 | 2.253 | −0.679 | 4.713 |
| −0.008 | −0.469 | 4.713 | −1.988 | 0.513 | 4.713 | 2.298 | −0.684 | 4.713 |
| −0.152 | −0.435 | 4.713 | −1.922 | 0.481 | 4.713 | 2.336 | −0.689 | 4.713 |
| −0.295 | −0.397 | 4.713 | −1.852 | 0.448 | 4.713 | 2.368 | −0.692 | 4.713 |
| −0.436 | −0.357 | 4.713 | −1.773 | 0.411 | 4.713 | 2.393 | −0.695 | 4.713 |
| −0.577 | −0.314 | 4.713 | −1.684 | 0.370 | 4.713 | 2.412 | −0.698 | 4.713 |
| −0.716 | −0.267 | 4.713 | −1.587 | 0.327 | 4.713 | 2.426 | −0.700 | 4.713 |
| −0.855 | −0.218 | 4.713 | −1.484 | 0.283 | 4.713 | 2.436 | −0.708 | 4.713 |
| −0.987 | −0.166 | 4.713 | −1.376 | 0.238 | 4.713 | 2.440 | −0.717 | 4.713 |

TABLE 4R-continued

| X-LOC | Y-LOC | Z-LOC | X-LOC | Y-LOC | Z-LOC | X-LOC | Y-LOC | Z-LOC |
|---|---|---|---|---|---|---|---|---|
| −1.114 | −0.114 | 4.713 | −1.264 | 0.193 | 4.713 | | | |
| −1.235 | −0.060 | 4.713 | −1.146 | 0.148 | 4.713 | | | |
| 2.356 | −1.009 | 6.059 | −1.366 | −0.020 | 6.059 | −1.040 | 0.057 | 6.059 |
| 2.354 | −1.016 | 6.059 | −1.474 | 0.040 | 6.059 | −0.914 | 0.005 | 6.059 |
| 2.347 | −1.024 | 6.059 | −1.577 | 0.100 | 6.059 | −0.784 | −0.048 | 6.059 |
| 2.336 | −1.028 | 6.059 | −1.673 | 0.161 | 6.059 | −0.649 | −0.100 | 6.059 |
| 2.321 | −1.027 | 6.059 | −1.765 | 0.220 | 6.059 | −0.513 | −0.152 | 6.059 |
| 2.301 | −1.024 | 6.059 | −1.847 | 0.277 | 6.059 | −0.376 | −0.202 | 6.059 |
| 2.276 | −1.020 | 6.059 | −1.919 | 0.329 | 6.059 | −0.239 | −0.251 | 6.059 |
| 2.244 | −1.015 | 6.059 | −1.982 | 0.377 | 6.059 | −0.102 | −0.299 | 6.059 |
| 2.206 | −1.009 | 6.059 | −2.040 | 0.423 | 6.059 | 0.036 | −0.346 | 6.059 |
| 2.160 | −1.002 | 6.059 | −2.090 | 0.465 | 6.059 | 0.173 | −0.393 | 6.059 |
| 2.106 | −0.994 | 6.059 | −2.127 | 0.498 | 6.059 | 0.312 | −0.438 | 6.059 |
| 2.043 | −0.984 | 6.059 | −2.155 | 0.526 | 6.059 | 0.450 | −0.483 | 6.059 |
| 1.970 | −0.973 | 6.059 | −2.174 | 0.549 | 6.059 | 0.589 | −0.527 | 6.059 |
| 1.886 | −0.961 | 6.059 | −2.187 | 0.567 | 6.059 | 0.728 | −0.570 | 6.059 |
| 1.794 | −0.947 | 6.059 | −2.192 | 0.578 | 6.059 | 0.867 | −0.611 | 6.059 |
| 1.691 | −0.932 | 6.059 | −2.194 | 0.586 | 6.059 | 1.002 | −0.651 | 6.059 |
| 1.579 | −0.914 | 6.059 | −2.193 | 0.590 | 6.059 | 1.133 | −0.688 | 6.059 |
| 1.462 | −0.896 | 6.059 | −2.193 | 0.592 | 6.059 | 1.259 | −0.723 | 6.059 |
| 1.340 | −0.876 | 6.059 | −2.192 | 0.592 | 6.059 | 1.381 | −0.756 | 6.059 |
| 1.214 | −0.854 | 6.059 | −2.191 | 0.593 | 6.059 | 1.498 | −0.787 | 6.059 |
| 1.082 | −0.831 | 6.059 | −2.190 | 0.595 | 6.059 | 1.611 | −0.817 | 6.059 |
| 0.947 | −0.805 | 6.059 | −2.186 | 0.596 | 6.059 | 1.719 | −0.8[] | 6.059 |
| 0.806 | −0.777 | 6.059 | −2.179 | 0.597 | 6.059 | 1.818 | −0.868 | 6.059 |
| 0.661 | −0.747 | 6.059 | −2.166 | 0.596 | 6.059 | 1.908 | −0.890 | 6.059 |
| 0.517 | −0.714 | 6.059 | −2.145 | 0.590 | 6.059 | 1.988 | −0.909 | 6.059 |
| 0.373 | −0.680 | 6.059 | −2.118 | 0.580 | 6.059 | 2.059 | −0.925 | 6.059 |
| 0.229 | −0.643 | 6.059 | −2.083 | 0.564 | 6.059 | 2.120 | −0.938 | 6.059 |
| 0.087 | −0.604 | 6.059 | −2.039 | 0.542 | 6.059 | 2.173 | −0.949 | 6.059 |
| −0.055 | −0.563 | 6.059 | −1.983 | 0.513 | 6.059 | 2.217 | −0.958 | 6.059 |
| −0.195 | −0.519 | 6.059 | −1.919 | 0.478 | 6.059 | 2.255 | −0.966 | 6.059 |
| −0.334 | −0.472 | 6.059 | −1.850 | 0.442 | 6.059 | 2.286 | −0.972 | 6.059 |
| −0.473 | −0.423 | 6.059 | −1.773 | 0.401 | 6.059 | 2.311 | −0.977 | 6.059 |
| −0.610 | −0.371 | 6.059 | −1.687 | 0.357 | 6.059 | 2.330 | −0.981 | 6.059 |
| −0.746 | −0.316 | 6.059 | −1.591 | 0.309 | 6.059 | 2.344 | −0.985 | 6.059 |
| −0.881 | −0.259 | 6.059 | −1.490 | 0.260 | 6.059 | 2.353 | −0.993 | 6.059 |
| −1.011 | −0.200 | 6.059 | −1.385 | 0.210 | 6.059 | 2.356 | −1.002 | 6.059 |
| −1.135 | −0.141 | 6.059 | −1.275 | 0.160 | 6.059 | | | |
| −1.253 | −0.081 | 6.059 | −1.160 | 0.109 | 6.059 | | | |
| 2.268 | −1.280 | 7.406 | −1.371 | −0.056 | 7.406 | −1.052 | −0.003 | 7.406 |
| 2.265 | −1.286 | 7.406 | −1.475 | 0.008 | 7.406 | −0.929 | −0.061 | 7.406 |
| 2.258 | −1.293 | 7.406 | −1.574 | 0.073 | 7.406 | −0.802 | −0.120 | 7.406 |
| 2.246 | −1.296 | 7.406 | −1.668 | 0.136 | 7.406 | −0.670 | −0.180 | 7.406 |
| 2.231 | −1.293 | 7.406 | −1.756 | 0.200 | 7.406 | −0.537 | −0.238 | 7.406 |
| 2.212 | −1.289 | 7.406 | −1.836 | 0.259 | 7.406 | −0.403 | −0.296 | 7.406 |
| 2.187 | −1.283 | 7.406 | −1.907 | 0.314 | 7.406 | −0.269 | −0.352 | 7.406 |
| 2.156 | −1.276 | 7.406 | −1.969 | 0.364 | 7.406 | −0.135 | −0.408 | 7.406 |
| 2.118 | −1.267 | 7.406 | −2.026 | 0.412 | 7.406 | −0.001 | −0.463 | 7.406 |
| 2.073 | −1.256 | 7.406 | −2.074 | 0.455 | 7.406 | 0.134 | −0.517 | 7.406 |
| 2.020 | −1.244 | 7.406 | −2.111 | 0.489 | 7.406 | 0.269 | −0.571 | 7.406 |
| 1.958 | −1.229 | 7.406 | −2.138 | 0.518 | 7.406 | 0.404 | −0.624 | 7.406 |
| 1.885 | −1.213 | 7.406 | −2.158 | 0.541 | 7.406 | 0.540 | −0.676 | 7.406 |
| 1.804 | −1.194 | 7.406 | −2.170 | 0.559 | 7.406 | 0.676 | −0.727 | 7.406 |
| 1.712 | −1.174 | 7.406 | −2.176 | 0.571 | 7.406 | 0.812 | −0.778 | 7.406 |
| 1.611 | −1.151 | 7.406 | −2.178 | 0.578 | 7.406 | 0.944 | −0.826 | 7.406 |
| 1.501 | −1.125 | 7.406 | −2.177 | 0.582 | 7.406 | 1.072 | −0.872 | 7.406 |
| 1.386 | −1.098 | 7.406 | −2.176 | 0.584 | 7.406 | 1.195 | −0.915 | 7.406 |
| 1.266 | −1.069 | 7.406 | −2.176 | 0.585 | 7.406 | 1.314 | −0.956 | 7.406 |
| 1.142 | −1.039 | 7.406 | −2.175 | 0.586 | 7.406 | 1.429 | −0.996 | 7.406 |
| 1.013 | −1.006 | 7.406 | −2.174 | 0.587 | 7.406 | 1.539 | −1.033 | 7.406 |
| 0.879 | −0.971 | 7.406 | −2.170 | 0.588 | 7.406 | 1.645 | −1.068 | 7.406 |
| 0.741 | −0.934 | 7.406 | −2.162 | 0.589 | 7.406 | 1.742 | −1.099 | 7.406 |
| 0.599 | −0.893 | 7.406 | −2.150 | 0.586 | 7.406 | 1.829 | −1.127 | 7.406 |
| 0.458 | −0.852 | 7.406 | −2.129 | 0.579 | 7.406 | 1.908 | −1.152 | 7.406 |
| 0.317 | −0.808 | 7.406 | −2.103 | 0.568 | 7.406 | 1.977 | −1.173 | 7.406 |
| 0.178 | −0.763 | 7.406 | −2.069 | 0.550 | 7.406 | 2.038 | −1.191 | 7.406 |
| 0.039 | −0.715 | 7.406 | −2.026 | 0.526 | 7.406 | 2.089 | −1.206 | 7.406 |
| −0.099 | −0.665 | 7.406 | −1.972 | 0.494 | 7.406 | 2.133 | −1.219 | 7.406 |
| −0.235 | −0.613 | 7.406 | −1.909 | 0.458 | 7.406 | 2.170 | −1.229 | 7.406 |
| −0.371 | −0.558 | 7.406 | −1.842 | 0.418 | 7.406 | 2.200 | −1.238 | 7.406 |
| −0.505 | −0.501 | 7.406 | −1.766 | 0.375 | 7.406 | 2.224 | −1.245 | 7.406 |
| −0.638 | −0.442 | 7.406 | −1.682 | 0.327 | 7.406 | 2.243 | −1.250 | 7.406 |
| −0.770 | −0.380 | 7.406 | −1.589 | 0.275 | 7.406 | 2.256 | −1.255 | 7.406 |
| −0.901 | −0.316 | 7.406 | −1.491 | 0.221 | 7.406 | 2.265 | −1.263 | 7.406 |
| −1.027 | −0.251 | 7.406 | −1.389 | 0.167 | 7.406 | 2.268 | −1.272 | 7.406 |
| −1.147 | −0.186 | 7.406 | −1.281 | 0.111 | 7.406 | | | |

TABLE 4R-continued

| X-LOC | Y-LOC | Z-LOC | X-LOC | Y-LOC | Z-LOC | X-LOC | Y-LOC | Z-LOC |
|---|---|---|---|---|---|---|---|---|
| −1.262 | −0.121 | 7.406 | −1.169 | 0.054 | 7.406 | | | |
| 2.154 | −1.504 | 8.752 | −1.389 | −0.067 | 8.752 | −1.069 | −0.039 | 8.752 |
| 2.151 | −1.511 | 8.752 | −1.489 | 0.002 | 8.752 | −0.950 | −0.103 | 8.752 |
| 2.143 | −1.517 | 8.752 | −1.585 | 0.071 | 8.752 | −0.826 | −0.168 | 8.752 |
| 2.131 | −1.518 | 8.752 | −1.675 | 0.137 | 8.752 | −0.697 | −0.233 | 8.752 |
| 2.117 | −1.514 | 8.752 | −1.760 | 0.203 | 8.752 | −0.568 | −0.298 | 8.752 |
| 2.099 | −1.508 | 8.752 | −1.836 | 0.264 | 8.752 | −0.438 | −0.361 | 8.752 |
| 2.074 | −1.501 | 8.752 | −1.904 | 0.321 | 8.752 | −0.308 | −0.424 | 8.752 |
| 2.044 | −1.491 | 8.752 | −1.963 | 0.372 | 8.752 | −0.177 | −0.486 | 8.752 |
| 2.008 | −1.479 | 8.752 | −2.017 | 0.421 | 8.752 | −0.046 | −0.548 | 8.752 |
| 1.964 | −1.465 | 8.752 | −2.063 | 0.465 | 8.752 | 0.085 | −0.609 | 8.752 |
| 1.913 | −1.449 | 8.752 | −2.098 | 0.499 | 8.752 | 0.216 | −0.670 | 8.752 |
| 1.853 | −1.430 | 8.752 | −2.124 | 0.528 | 8.752 | 0.347 | −0.730 | 8.752 |
| 1.783 | −1.408 | 8.752 | −2.143 | 0.550 | 8.752 | 0.479 | −0.789 | 8.752 |
| 1.703 | −1.384 | 8.752 | −2.155 | 0.568 | 8.752 | 0.611 | −0.848 | 8.752 |
| 1.615 | −1.357 | 8.752 | −2.161 | 0.579 | 8.752 | 0.744 | −0.906 | 8.752 |
| 1.517 | −1.327 | 8.752 | −2.163 | 0.587 | 8.752 | 0.872 | −0.962 | 8.752 |
| 1.410 | −1.294 | 8.752 | −2.163 | 0.591 | 8.752 | 0.996 | −1.016 | 8.752 |
| 1.298 | −1.260 | 8.752 | −2.162 | 0.593 | 8.752 | 1.115 | −1.067 | 8.752 |
| 1.182 | −1.223 | 8.752 | −2.161 | 0.593 | 8.752 | 1.231 | −1.115 | 8.752 |
| 1.061 | −1.185 | 8.752 | −2.161 | 0.594 | 8.752 | 1.342 | −1.162 | 8.752 |
| 0.936 | −1.144 | 8.752 | −2.159 | 0.595 | 8.752 | 1.449 | −1.206 | 8.752 |
| 0.806 | −1.102 | 8.752 | −2.155 | 0.596 | 8.752 | 1.552 | −1.248 | 8.752 |
| 0.673 | −1.056 | 8.752 | −2.147 | 0.596 | 8.752 | 1.645 | −1.286 | 8.752 |
| 0.535 | −1.008 | 8.752 | −2.136 | 0.593 | 8.752 | 1.730 | −1.320 | 8.752 |
| 0.398 | −0.958 | 8.752 | −2.116 | 0.585 | 8.752 | 1.807 | −1.350 | 8.752 |
| 0.261 | −0.906 | 8.752 | −2.090 | 0.571 | 8.752 | 1.874 | −1.377 | 8.752 |
| 0.125 | −0.853 | 8.752 | −2.057 | 0.552 | 8.752 | 1.932 | −1.399 | 8.752 |
| −0.011 | −0.798 | 8.752 | −2.016 | 0.527 | 8.752 | 1.982 | −1.418 | 8.752 |
| −0.145 | −0.740 | 8.752 | −1.963 | 0.493 | 8.752 | 2.025 | −1.433 | 8.752 |
| −0.279 | −0.680 | 8.752 | −1.902 | 0.454 | 8.752 | 2.060 | −1.447 | 8.752 |
| −0.412 | −0.618 | 8.752 | −1.837 | 0.413 | 8.752 | 2.090 | −1.458 | 8.752 |
| −0.543 | −0.554 | 8.752 | −1.763 | 0.366 | 8.752 | 2.113 | −1.467 | 8.752 |
| −0.674 | −0.488 | 8.752 | −1.681 | 0.315 | 8.752 | 2.131 | −1.473 | 8.752 |
| −0.803 | −0.419 | 8.752 | −1.591 | 0.260 | 8.752 | 2.144 | −1.479 | 8.752 |
| −0.931 | −0.348 | 8.752 | −1.496 | 0.203 | 8.752 | 2.153 | −1.488 | 8.752 |
| −1.054 | −0.277 | 8.752 | −1.396 | 0.144 | 8.752 | 2.155 | −1.497 | 8.752 |
| −1.171 | −0.206 | 8.752 | −1.292 | 0.084 | 8.752 | | | |
| −1.282 | −0.136 | 8.752 | −1.183 | 0.023 | 8.752 | | | |
| 2.008 | −1.611 | 9.762 | −1.412 | −0.001 | 9.762 | −1.098 | 0.008 | 9.762 |
| 2.005 | −1.617 | 9.762 | −1.509 | 0.071 | 9.762 | −0.983 | −0.061 | 9.762 |
| 1.997 | −1.623 | 9.762 | −1.600 | 0.142 | 9.762 | −0.863 | −0.130 | 9.762 |
| 1.985 | −1.623 | 9.762 | −1.687 | 0.211 | 9.762 | −0.739 | −0.201 | 9.762 |
| 1.971 | −1.619 | 9.762 | −1.768 | 0.280 | 9.762 | −0.614 | −0.271 | 9.762 |
| 1.953 | −1.612 | 9.762 | −1.841 | 0.343 | 9.762 | −0.489 | −0.340 | 9.762 |
| 1.930 | −1.603 | 9.762 | −1.905 | 0.401 | 9.762 | −0.364 | −0.409 | 9.762 |
| 1.900 | −1.592 | 9.762 | −1.962 | 0.454 | 9.762 | −0.238 | −0.477 | 9.762 |
| 1.865 | −1.579 | 9.762 | −2.013 | 0.504 | 9.762 | −0.112 | −0.544 | 9.762 |
| 1.822 | −1.562 | 9.762 | −2.057 | 0.549 | 9.762 | 0.014 | −0.611 | 9.762 |
| 1.773 | −1.543 | 9.762 | −2.090 | 0.584 | 9.762 | 0.141 | −0.678 | 9.762 |
| 1.714 | −1.522 | 9.762 | −2.116 | 0.613 | 9.762 | 0.267 | −0.745 | 9.762 |
| 1.646 | −1.497 | 9.762 | −2.134 | 0.636 | 9.762 | 0.394 | −0.811 | 9.762 |
| 1.569 | −1.469 | 9.762 | −2.146 | 0.654 | 9.762 | 0.521 | −0.876 | 9.762 |
| 1.483 | −1.437 | 9.762 | −2.151 | 0.665 | 9.762 | 0.649 | −0.941 | 9.762 |
| 1.388 | −1.402 | 9.762 | −2.153 | 0.672 | 9.762 | 0.772 | −1.004 | 9.762 |
| 1.284 | −1.364 | 9.762 | −2.153 | 0.676 | 9.762 | 0.892 | −1.064 | 9.762 |
| 1.176 | −1.323 | 9.762 | −2.152 | 0.678 | 9.762 | 1.007 | −1.121 | 9.762 |
| 1.063 | −1.281 | 9.762 | −2.151 | 0.679 | 9.762 | 1.118 | −1.176 | 9.762 |
| 0.946 | −1.236 | 9.762 | −2.151 | 0.679 | 9.762 | 1.225 | −1.228 | 9.762 |
| 0.825 | −1.189 | 9.762 | −2.149 | 0.680 | 9.762 | 1.328 | −1.278 | 9.762 |
| 0.699 | −1.139 | 9.762 | −2.145 | 0.681 | 9.762 | 1.427 | −1.325 | 9.762 |
| 0.570 | −1.086 | 9.762 | −2.138 | 0.680 | 9.762 | 1.518 | −1.368 | 9.762 |
| 0.437 | −1.030 | 9.762 | −2.126 | 0.676 | 9.762 | 1.600 | −1.406 | 9.762 |
| 0.304 | −0.973 | 9.762 | −2.107 | 0.667 | 9.762 | 1.673 | −1.441 | 9.762 |
| 0.172 | −0.914 | 9.762 | −2.082 | 0.653 | 9.762 | 1.738 | −1.470 | 9.762 |
| 0.041 | −0.854 | 9.762 | −2.050 | 0.632 | 9.762 | 1.795 | −1.496 | 9.762 |
| −0.090 | −0.791 | 9.762 | −2.010 | 0.606 | 9.762 | 1.843 | −1.517 | 9.762 |
| −0.219 | −0.727 | 9.762 | −1.959 | 0.571 | 9.762 | 1.884 | −1.535 | 9.762 |
| −0.348 | −0.661 | 9.762 | −1.901 | 0.530 | 9.762 | 1.918 | −1.550 | 9.762 |
| −0.475 | −0.592 | 9.762 | −1.838 | 0.486 | 9.762 | 1.947 | −1.562 | 9.762 |
| −0.602 | −0.522 | 9.762 | −1.767 | 0.438 | 9.762 | 1.969 | −1.572 | 9.762 |
| −0.727 | −0.450 | 9.762 | −1.688 | 0.384 | 9.762 | 1.987 | −1.580 | 9.762 |
| −0.851 | −0.376 | 9.762 | −1.601 | 0.326 | 9.762 | 2.000 | −1.586 | 9.762 |
| −0.974 | −0.300 | 9.762 | −1.510 | 0.265 | 9.762 | 2.008 | −1.595 | 9.762 |
| −1.092 | −0.224 | 9.762 | −1.414 | 0.203 | 9.762 | 2.009 | −1.604 | 9.762 |
| −1.204 | −0.149 | 9.762 | −1.313 | 0.140 | 9.762 | | | |
| −1.311 | −0.074 | 9.762 | −1.208 | 0.074 | 9.762 | | | |

TABLE 4R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.864 | −1.699 | 10.772 | −1.443 | 0.192 | 10.772 | −1.137 | 0.160 | 10.772 |
| 1.860 | −1.705 | 10.772 | −1.532 | 0.275 | 10.772 | −1.029 | 0.080 | 10.772 |
| 1.851 | −1.710 | 10.772 | −1.616 | 0.357 | 10.772 | −0.916 | −0.002 | 10.772 |
| 1.839 | −1.710 | 10.772 | −1.695 | 0.437 | 10.772 | −0.799 | −0.086 | 10.772 |
| 1.826 | −1.705 | 10.772 | −1.769 | 0.514 | 10.772 | −0.681 | −0.169 | 10.772 |
| 1.808 | −1.697 | 10.772 | −1.835 | 0.586 | 10.772 | −0.562 | −0.250 | 10.772 |
| 1.784 | −1.688 | 10.772 | −1.893 | 0.652 | 10.772 | −0.442 | −0.331 | 10.772 |
| 1.755 | −1.676 | 10.772 | −1.944 | 0.711 | 10.772 | −0.322 | −0.411 | 10.772 |
| 1.719 | −1.661 | 10.772 | −1.991 | 0.768 | 10.772 | −0.201 | −0.490 | 10.772 |
| 1.677 | −1.643 | 10.772 | −2.030 | 0.818 | 10.772 | −0.080 | −0.568 | 10.772 |
| 1.628 | −1.622 | 10.772 | −2.059 | 0.857 | 10.772 | 0.041 | −0.646 | 10.772 |
| 1.570 | −1.598 | 10.772 | −2.082 | 0.888 | 10.772 | 0.163 | −0.724 | 10.772 |
| 1.502 | −1.570 | 10.772 | −2.098 | 0.913 | 10.772 | 0.285 | −0.800 | 10.772 |
| 1.425 | −1.538 | 10.772 | −2.108 | 0.932 | 10.772 | 0.407 | −0.876 | 10.772 |
| 1.340 | −1.503 | 10.772 | −2.113 | 0.944 | 10.772 | 0.530 | −0.951 | 10.772 |
| 1.246 | −1.463 | 10.772 | −2.115 | 0.951 | 10.772 | 0.650 | −1.023 | 10.772 |
| 1.143 | −1.419 | 10.772 | −2.114 | 0.955 | 10.772 | 0.765 | −1.092 | 10.772 |
| 1.036 | −1.372 | 10.772 | −2.114 | 0.957 | 10.772 | 0.877 | −1.158 | 10.772 |
| 0.925 | −1.323 | 10.772 | −2.113 | 0.958 | 10.772 | 0.986 | −1.220 | 10.772 |
| 0.810 | −1.270 | 10.772 | −2.112 | 0.958 | 10.772 | 1.090 | −1.279 | 10.772 |
| 0.691 | −1.215 | 10.772 | −2.110 | 0.959 | 10.772 | 1.191 | −1.335 | 10.772 |
| 0.569 | −1.156 | 10.772 | −2.106 | 0.959 | 10.772 | 1.289 | −1.388 | 10.772 |
| 0.443 | −1.093 | 10.772 | −2.099 | 0.956 | 10.772 | 1.378 | −1.435 | 10.772 |
| 0.313 | −1.026 | 10.772 | −2.088 | 0.951 | 10.772 | 1.458 | −1.478 | 10.772 |
| 0.185 | −0.958 | 10.772 | −2.071 | 0.939 | 10.772 | 1.531 | −1.516 | 10.772 |
| 0.058 | −0.887 | 10.772 | −2.048 | 0.921 | 10.772 | 1.595 | −1.548 | 10.772 |
| −0.069 | −0.814 | 10.772 | −2.019 | 0.896 | 10.772 | 1.651 | −1.576 | 10.772 |
| −0.194 | −0.739 | 10.772 | −1.982 | 0.864 | 10.772 | 1.699 | −1.599 | 10.772 |
| −0.317 | −0.662 | 10.772 | −1.935 | 0.823 | 10.772 | 1.740 | −1.618 | 10.772 |
| −0.440 | −0.583 | 10.772 | −1.882 | 0.775 | 10.772 | 1.774 | −1.635 | 10.772 |
| −0.562 | −0.501 | 10.772 | −1.824 | 0.724 | 10.772 | 1.802 | −1.648 | 10.772 |
| −0.682 | −0.418 | 10.772 | −1.759 | 0.667 | 10.772 | 1.825 | −1.659 | 10.772 |
| −0.801 | −0.332 | 10.772 | −1.686 | 0.604 | 10.772 | 1.842 | −1.667 | 10.772 |
| −0.918 | −0.245 | 10.772 | −1.606 | 0.535 | 10.772 | 1.855 | −1.673 | 10.772 |
| −1.034 | −0.155 | 10.772 | −1.521 | 0.465 | 10.772 | 1.863 | −1.682 | 10.772 |
| −1.144 | −0.067 | 10.772 | −1.432 | 0.391 | 10.772 | 1.865 | −1.692 | 10.772 |
| −1.249 | 0.021 | 10.772 | −1.338 | 0.316 | 10.772 | | | |
| −1.348 | 0.107 | 10.772 | −1.240 | 0.239 | 10.772 | | | |

The coordinate values given in TABLE 5R below provide the nominal profile envelope for an exemplary fifth stage rotor.

TABLE 5R

| X-LOC | Y-LOC | Z-LOC | X-LOC | Y-LOC | Z-LOC | X-LOC | Y-LOC | Z-LOC |
|---|---|---|---|---|---|---|---|---|
| 2.297 | 0.226 | 0.000 | −1.238 | −0.096 | 0.000 | −0.914 | 0.161 | 0.000 |
| 2.298 | 0.219 | 0.000 | −1.345 | −0.050 | 0.000 | −0.793 | 0.141 | 0.000 |
| 2.297 | 0.210 | 0.000 | −1.445 | −0.002 | 0.000 | −0.667 | 0.123 | 0.000 |
| 2.293 | 0.199 | 0.000 | −1.539 | 0.048 | 0.000 | −0.536 | 0.108 | 0.000 |
| 2.283 | 0.190 | 0.000 | −1.627 | 0.098 | 0.000 | −0.404 | 0.096 | 0.000 |
| 2.266 | 0.183 | 0.000 | −1.706 | 0.148 | 0.000 | −0.273 | 0.085 | 0.000 |
| 2.243 | 0.174 | 0.000 | −1.775 | 0.195 | 0.000 | −0.141 | 0.076 | 0.000 |
| 2.215 | 0.164 | 0.000 | −1.835 | 0.239 | 0.000 | −0.009 | 0.069 | 0.000 |
| 2.180 | 0.152 | 0.000 | −1.890 | 0.283 | 0.000 | 0.122 | 0.064 | 0.000 |
| 2.139 | 0.138 | 0.000 | −1.937 | 0.323 | 0.000 | 0.254 | 0.061 | 0.000 |
| 2.091 | 0.121 | 0.000 | −1.972 | 0.355 | 0.000 | 0.386 | 0.060 | 0.000 |
| 2.034 | 0.101 | 0.000 | −1.998 | 0.383 | 0.000 | 0.517 | 0.061 | 0.000 |
| 1.968 | 0.079 | 0.000 | −2.016 | 0.405 | 0.000 | 0.649 | 0.064 | 0.000 |
| 1.893 | 0.054 | 0.000 | −2.026 | 0.424 | 0.000 | 0.781 | 0.068 | 0.000 |
| 1.810 | 0.027 | 0.000 | −2.028 | 0.435 | 0.000 | 0.912 | 0.075 | 0.000 |
| 1.717 | −0.002 | 0.000 | −2.028 | 0.443 | 0.000 | 1.040 | 0.083 | 0.000 |
| 1.615 | −0.033 | 0.000 | −2.027 | 0.446 | 0.000 | 1.162 | 0.092 | 0.000 |
| 1.508 | −0.064 | 0.000 | −2.026 | 0.448 | 0.000 | 1.281 | 0.103 | 0.000 |
| 1.396 | −0.096 | 0.000 | −2.026 | 0.449 | 0.000 | 1.394 | 0.115 | 0.000 |
| 1.280 | −0.127 | 0.000 | −2.025 | 0.450 | 0.000 | 1.504 | 0.127 | 0.000 |
| 1.159 | −0.157 | 0.000 | −2.024 | 0.451 | 0.000 | 1.608 | 0.141 | 0.000 |
| 1.033 | −0.186 | 0.000 | −2.022 | 0.453 | 0.000 | 1.708 | 0.155 | 0.000 |
| 0.902 | −0.213 | 0.000 | −2.015 | 0.457 | 0.000 | 1.800 | 0.169 | 0.000 |
| 0.767 | −0.239 | 0.000 | −2.005 | 0.459 | 0.000 | 1.882 | 0.182 | 0.000 |
| 0.632 | −0.261 | 0.000 | −1.985 | 0.459 | 0.000 | 1.956 | 0.194 | 0.000 |
| 0.496 | −0.280 | 0.000 | −1.959 | 0.454 | 0.000 | 2.021 | 0.205 | 0.000 |

TABLE 5R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.359 | −0.295 | 0.000 | −1.925 | 0.444 | 0.000 | 2.077 | 0.216 | 0.000 |
| 0.222 | −0.307 | 0.000 | −1.883 | 0.430 | 0.000 | 2.125 | 0.224 | 0.000 |
| 0.085 | −0.313 | 0.000 | −1.829 | 0.412 | 0.000 | 2.166 | 0.232 | 0.000 |
| −0.053 | −0.316 | 0.000 | −1.767 | 0.390 | 0.000 | 2.200 | 0.238 | 0.000 |
| −0.191 | −0.313 | 0.000 | −1.700 | 0.368 | 0.000 | 2.228 | 0.244 | 0.000 |
| −0.330 | −0.306 | 0.000 | −1.625 | 0.343 | 0.000 | 2.250 | 0.248 | 0.000 |
| −0.469 | −0.293 | 0.000 | −1.541 | 0.316 | 0.000 | 2.268 | 0.250 | 0.000 |
| −0.609 | −0.273 | 0.000 | −1.449 | 0.288 | 0.000 | 2.280 | 0.246 | 0.000 |
| −0.746 | −0.246 | 0.000 | −1.352 | 0.260 | 0.000 | 2.289 | 0.239 | 0.000 |
| −0.878 | −0.215 | 0.000 | −1.250 | 0.233 | 0.000 | 2.294 | 0.232 | 0.000 |
| −1.005 | −0.179 | 0.000 | −1.143 | 0.208 | 0.000 | | | |
| −1.125 | −0.139 | 0.000 | −1.031 | 0.184 | 0.000 | | | |
| 2.188 | 0.305 | 0.879 | −1.194 | −0.047 | 0.879 | −0.897 | 0.212 | 0.879 |
| 2.189 | 0.299 | 0.879 | −1.298 | −0.011 | 0.879 | −0.780 | 0.200 | 0.879 |
| 2.188 | 0.290 | 0.879 | −1.395 | 0.027 | 0.879 | −0.658 | 0.189 | 0.879 |
| 2.184 | 0.280 | 0.879 | −1.488 | 0.067 | 0.879 | −0.532 | 0.181 | 0.879 |
| 2.174 | 0.271 | 0.879 | −1.575 | 0.108 | 0.879 | −0.405 | 0.174 | 0.879 |
| 2.158 | 0.265 | 0.879 | −1.653 | 0.148 | 0.879 | −0.279 | 0.168 | 0.879 |
| 2.136 | 0.258 | 0.879 | −1.722 | 0.187 | 0.879 | −0.152 | 0.164 | 0.879 |
| 2.108 | 0.249 | 0.879 | −1.783 | 0.223 | 0.879 | −0.026 | 0.161 | 0.879 |
| 2.075 | 0.239 | 0.879 | −1.839 | 0.260 | 0.879 | 0.100 | 0.160 | 0.879 |
| 2.036 | 0.227 | 0.879 | −1.886 | 0.293 | 0.879 | 0.227 | 0.160 | 0.879 |
| 1.989 | 0.212 | 0.879 | −1.922 | 0.319 | 0.879 | 0.353 | 0.161 | 0.879 |
| 1.934 | 0.196 | 0.879 | −1.949 | 0.343 | 0.879 | 0.480 | 0.164 | 0.879 |
| 1.871 | 0.177 | 0.879 | −1.968 | 0.362 | 0.879 | 0.606 | 0.168 | 0.879 |
| 1.799 | 0.156 | 0.879 | −1.979 | 0.378 | 0.879 | 0.732 | 0.173 | 0.879 |
| 1.719 | 0.132 | 0.879 | −1.983 | 0.389 | 0.879 | 0.859 | 0.180 | 0.879 |
| 1.629 | 0.108 | 0.879 | −1.983 | 0.396 | 0.879 | 0.981 | 0.188 | 0.879 |
| 1.532 | 0.081 | 0.879 | −1.983 | 0.399 | 0.879 | 1.098 | 0.197 | 0.879 |
| 1.430 | 0.054 | 0.879 | −1.982 | 0.401 | 0.879 | 1.212 | 0.207 | 0.879 |
| 1.323 | 0.026 | 0.879 | −1.982 | 0.402 | 0.879 | 1.321 | 0.217 | 0.879 |
| 1.212 | −0.002 | 0.879 | −1.981 | 0.403 | 0.879 | 1.426 | 0.228 | 0.879 |
| 1.096 | −0.029 | 0.879 | −1.980 | 0.404 | 0.879 | 1.526 | 0.239 | 0.879 |
| 0.976 | −0.056 | 0.879 | −1.978 | 0.407 | 0.879 | 1.623 | 0.251 | 0.879 |
| 0.851 | −0.082 | 0.879 | −1.972 | 0.410 | 0.879 | 1.711 | 0.263 | 0.879 |
| 0.722 | −0.106 | 0.879 | −1.962 | 0.414 | 0.879 | 1.790 | 0.273 | 0.879 |
| 0.592 | −0.128 | 0.879 | −1.943 | 0.415 | 0.879 | 1.861 | 0.283 | 0.879 |
| 0.462 | −0.148 | 0.879 | −1.918 | 0.413 | 0.879 | 1.924 | 0.292 | 0.879 |
| 0.332 | −0.164 | 0.879 | −1.885 | 0.407 | 0.879 | 1.978 | 0.301 | 0.879 |
| 0.201 | −0.177 | 0.879 | −1.885 | 0.398 | 0.879 | 2.024 | 0.308 | 0.879 |
| 0.070 | −0.187 | 0.879 | −1.790 | 0.385 | 0.879 | 2.063 | 0.314 | 0.879 |
| −0.062 | −0.193 | 0.879 | −1.729 | 0.371 | 0.879 | 2.096 | 0.320 | 0.879 |
| −0.195 | −0.196 | 0.879 | −1.663 | 0.355 | 0.879 | 2.123 | 0.324 | 0.879 |
| −0.327 | −0.194 | 0.879 | −1.589 | 0.338 | 0.879 | 2.145 | 0.327 | 0.879 |
| −0.460 | −0.188 | 0.879 | −1.507 | 0.319 | 0.879 | 2.161 | 0.329 | 0.879 |
| −0.592 | −0.176 | 0.879 | −1.417 | 0.299 | 0.879 | 2.173 | 0.325 | 0.879 |
| −0.723 | −0.158 | 0.879 | −1.322 | 0.279 | 0.879 | 2.181 | 0.318 | 0.879 |
| −0.849 | −0.136 | 0.879 | −1.222 | 0.260 | 0.879 | 2.186 | 0.311 | 0.879 |
| −0.970 | −0.110 | 0.879 | −1.119 | 0.243 | 0.879 | | | |
| −1.085 | −0.080 | 0.879 | −1.010 | 0.226 | 0.879 | | | |
| 2.164 | 0.227 | 1.759 | −1.159 | −0.010 | 1.759 | −0.876 | 0.232 | 1.759 |
| 2.165 | 0.221 | 1.759 | −1.261 | 0.024 | 1.759 | −0.760 | 0.220 | 1.759 |
| 2.163 | 0.213 | 1.759 | −1.359 | 0.059 | 1.759 | −0.640 | 0.208 | 1.759 |
| 2.158 | 0.203 | 1.759 | −1.451 | 0.096 | 1.759 | −0.516 | 0.198 | 1.759 |
| 2.148 | 0.195 | 1.759 | −1.538 | 0.135 | 1.759 | −0.392 | 0.189 | 1.759 |
| 2.132 | 0.190 | 1.759 | −1.616 | 0.172 | 1.759 | −0.268 | 0.180 | 1.759 |
| 2.110 | 0.185 | 1.759 | −1.685 | 0.208 | 1.759 | −0.144 | 0.173 | 1.759 |
| 2.083 | 0.177 | 1.759 | −1.746 | 0.241 | 1.759 | −0.019 | 0.167 | 1.759 |
| 2.050 | 0.169 | 1.759 | −1.801 | 0.275 | 1.759 | 0.105 | 0.162 | 1.759 |
| 2.011 | 0.159 | 1.759 | −1.848 | 0.305 | 1.759 | 0.229 | 0.158 | 1.759 |
| 1.965 | 0.147 | 1.759 | −1.884 | 0.330 | 1.759 | 0.354 | 0.155 | 1.759 |
| 1.911 | 0.134 | 1.759 | −1.911 | 0.351 | 1.759 | 0.478 | 0.154 | 1.759 |
| 1.848 | 0.118 | 1.759 | −1.930 | 0.369 | 1.759 | 0.602 | 0.153 | 1.759 |
| 1.777 | 0.101 | 1.759 | −1.941 | 0.385 | 1.759 | 0.727 | 0.154 | 1.759 |
| 1.698 | 0.082 | 1.759 | −1.946 | 0.395 | 1.759 | 0.851 | 0.156 | 1.759 |
| 1.610 | 0.062 | 1.759 | −1.946 | 0.402 | 1.759 | 0.972 | 0.159 | 1.759 |
| 1.513 | 0.040 | 1.759 | −1.946 | 0.405 | 1.759 | 1.088 | 0.163 | 1.759 |
| 1.412 | 0.018 | 1.759 | −1.945 | 0.407 | 1.759 | 1.200 | 0.168 | 1.759 |
| 1.307 | −0.004 | 1.759 | −1.945 | 0.408 | 1.759 | 1.307 | 0.174 | 1.759 |
| 1.198 | −0.026 | 1.759 | −1.945 | 0.408 | 1.759 | 1.411 | 0.181 | 1.759 |
| 1.084 | −0.047 | 1.759 | −1.944 | 0.410 | 1.759 | 1.510 | 0.188 | 1.759 |
| 0.965 | −0.068 | 1.759 | −1.942 | 0.412 | 1.759 | 1.605 | 0.196 | 1.759 |
| 0.843 | −0.088 | 1.759 | −1.936 | 0.416 | 1.759 | 1.692 | 0.204 | 1.759 |
| 0.716 | −0.106 | 1.759 | −1.926 | 0.419 | 1.759 | 1.771 | 0.212 | 1.759 |
| 0.588 | −0.122 | 1.759 | −1.908 | 0.421 | 1.759 | 1.841 | 0.219 | 1.759 |
| 0.461 | −0.135 | 1.759 | −1.883 | 0.420 | 1.759 | 1.903 | 0.225 | 1.759 |
| 0.333 | −0.147 | 1.759 | −1.850 | 0.414 | 1.759 | 1.957 | 0.231 | 1.759 |

TABLE 5R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.205 | −0.155 | 1.759 | −1.809 | 0.406 | 1.759 | 2.002 | 0.236 | 1.759 |
| 0.077 | −0.160 | 1.759 | −1.757 | 0.394 | 1.759 | 2.041 | 0.240 | 1.759 |
| −0.052 | −0.162 | 1.759 | −1.696 | 0.381 | 1.759 | 2.073 | 0.244 | 1.759 |
| −0.181 | −0.161 | 1.759 | −1.631 | 0.366 | 1.759 | 2.100 | 0.247 | 1.759 |
| −0.310 | −0.156 | 1.759 | −1.558 | 0.350 | 1.759 | 2.121 | 0.250 | 1.759 |
| −0.439 | −0.147 | 1.759 | −1.477 | 0.332 | 1.759 | 2.138 | 0.251 | 1.759 |
| −0.568 | −0.134 | 1.759 | −1.388 | 0.314 | 1.759 | 2.150 | 0.248 | 1.759 |
| −0.696 | −0.116 | 1.759 | −1.294 | 0.296 | 1.759 | 2.158 | 0.241 | 1.759 |
| −0.819 | −0.094 | 1.759 | −1.196 | 0.278 | 1.759 | 2.162 | 0.234 | 1.759 |
| −0.938 | −0.069 | 1.759 | −1.094 | 0.262 | 1.759 | | | |
| −1.051 | −0.041 | 1.759 | −0.987 | 0.246 | 1.759 | | | |
| 2.154 | 0.034 | 2.931 | −1.117 | 0.019 | 2.931 | −0.838 | 0.234 | 2.931 |
| 2.154 | 0.027 | 2.931 | −1.217 | 0.054 | 2.931 | −0.725 | 0.216 | 2.931 |
| 2.152 | 0.019 | 2.931 | −1.312 | 0.090 | 2.931 | −0.608 | 0.199 | 2.931 |
| 2.146 | 0.011 | 2.931 | −1.403 | 0.128 | 2.931 | −0.486 | 0.183 | 2.931 |
| 2.135 | 0.004 | 2.931 | −1.488 | 0.166 | 2.931 | −0.364 | 0.167 | 2.931 |
| 2.118 | 0.001 | 2.931 | −1.564 | 0.203 | 2.931 | −0.243 | 0.152 | 2.931 |
| 2.097 | −0.003 | 2.931 | −1.632 | 0.239 | 2.931 | −0.121 | 0.137 | 2.931 |
| 2.070 | −0.008 | 2.931 | −1.691 | 0.272 | 2.931 | 0.001 | 0.124 | 2.931 |
| 2.037 | −0.014 | 2.931 | −1.746 | 0.305 | 2.931 | 0.123 | 0.111 | 2.931 |
| 1.998 | −0.020 | 2.931 | −1.792 | 0.335 | 2.931 | 0.246 | 0.100 | 2.931 |
| 1.952 | −0.028 | 2.931 | −1.828 | 0.359 | 2.931 | 0.368 | 0.089 | 2.931 |
| 1.898 | −0.037 | 2.931 | −1.855 | 0.379 | 2.931 | 0.490 | 0.080 | 2.931 |
| 1.836 | −0.048 | 2.931 | −1.873 | 0.397 | 2.931 | 0.613 | 0.071 | 2.931 |
| 1.765 | −0.059 | 2.931 | −1.885 | 0.412 | 2.931 | 0.735 | 0.064 | 2.931 |
| 1.686 | −0.071 | 2.931 | −1.889 | 0.422 | 2.931 | 0.858 | 0.057 | 2.931 |
| 1.599 | −0.084 | 2.931 | −1.890 | 0.429 | 2.931 | 0.976 | 0.052 | 2.931 |
| 1.503 | −0.098 | 2.931 | −1.890 | 0.432 | 2.931 | 1.091 | 0.048 | 2.931 |
| 1.403 | −0.111 | 2.931 | −1.889 | 0.434 | 2.931 | 1.201 | 0.045 | 2.931 |
| 1.298 | −0.125 | 2.931 | −1.889 | 0.434 | 2.931 | 1.308 | 0.043 | 2.931 |
| 1.190 | −0.138 | 2.931 | −1.888 | 0.435 | 2.931 | 1.410 | 0.042 | 2.931 |
| 1.077 | −0.151 | 2.931 | −1.887 | 0.437 | 2.931 | 1.508 | 0.042 | 2.931 |
| 0.960 | −0.162 | 2.931 | −1.885 | 0.439 | 2.931 | 1.602 | 0.043 | 2.931 |
| 0.839 | −0.172 | 2.931 | −1.880 | 0.442 | 2.931 | 1.688 | 0.044 | 2.931 |
| 0.713 | −0.181 | 2.931 | −1.870 | 0.445 | 2.931 | 1.766 | 0.046 | 2.931 |
| 0.588 | −0.187 | 2.931 | −1.851 | 0.446 | 2.931 | 1.835 | 0.047 | 2.931 |
| 0.463 | −0.192 | 2.931 | −1.827 | 0.444 | 2.931 | 1.897 | 0.049 | 2.931 |
| 0.337 | −0.194 | 2.931 | −1.795 | 0.437 | 2.931 | 1.950 | 0.051 | 2.931 |
| 0.212 | −0.193 | 2.931 | −1.755 | 0.428 | 2.931 | 1.995 | 0.052 | 2.931 |
| 0.087 | −0.190 | 2.931 | −1.703 | 0.415 | 2.931 | 2.034 | 0.054 | 2.931 |
| −0.039 | −0.184 | 2.931 | −1.644 | 0.401 | 2.931 | 2.066 | 0.055 | 2.931 |
| −0.164 | −0.175 | 2.931 | −1.580 | 0.385 | 2.931 | 2.092 | 0.056 | 2.931 |
| −0.290 | −0.162 | 2.931 | −1.508 | 0.368 | 2.931 | 2.114 | 0.057 | 2.931 |
| −0.415 | −0.146 | 2.931 | −1.429 | 0.349 | 2.931 | 2.130 | 0.058 | 2.931 |
| −0.540 | −0.126 | 2.931 | −1.341 | 0.329 | 2.931 | 2.141 | 0.054 | 2.931 |
| −0.666 | −0.102 | 2.931 | −1.249 | 0.309 | 2.931 | 2.149 | 0.047 | 2.931 |
| −0.786 | −0.075 | 2.931 | −1.153 | 0.290 | 2.931 | 2.153 | 0.040 | 2.931 |
| −0.901 | −0.046 | 2.931 | −1.052 | 0.271 | 2.931 | | | |
| −1.011 | −0.015 | 2.931 | −0.947 | 0.252 | 2.931 | | | |
| 2.117 | −0.181 | 4.104 | −1.072 | 0.007 | 4.104 | −0.796 | 0.202 | 4.104 |
| 2.116 | −0.187 | 4.104 | −1.169 | 0.046 | 4.104 | −0.686 | 0.180 | 4.104 |
| 2.113 | −0.194 | 4.104 | −1.260 | 0.085 | 4.104 | −0.572 | 0.158 | 4.104 |
| 2.106 | −0.202 | 4.104 | −1.347 | 0.125 | 4.104 | −0.454 | 0.136 | 4.104 |
| 2.095 | −0.207 | 4.104 | −1.429 | 0.165 | 4.104 | −0.336 | 0.115 | 4.104 |
| 2.079 | −0.208 | 4.104 | −1.503 | 0.204 | 4.104 | −0.218 | 0.095 | 4.104 |
| 2.058 | −0.211 | 4.104 | −1.568 | 0.240 | 4.104 | −0.099 | 0.075 | 4.104 |
| 2.031 | −0.214 | 4.104 | −1.625 | 0.274 | 4.104 | 0.019 | 0.055 | 4.104 |
| 1.999 | −0.217 | 4.104 | −1.678 | 0.308 | 4.104 | 0.138 | 0.036 | 4.104 |
| 1.960 | −0.221 | 4.104 | −1.723 | 0.338 | 4.104 | 0.257 | 0.017 | 4.104 |
| 1.915 | −0.225 | 4.104 | −1.757 | 0.361 | 4.104 | 0.376 | −0.001 | 4.104 |
| 1.862 | −0.230 | 4.104 | −1.784 | 0.381 | 4.104 | 0.494 | −0.018 | 4.104 |
| 1.800 | −0.236 | 4.104 | −1.802 | 0.398 | 4.104 | 0.613 | −0.034 | 4.104 |
| 1.731 | −0.242 | 4.104 | −1.813 | 0.413 | 4.104 | 0.733 | −0.049 | 4.104 |
| 1.653 | −0.248 | 4.104 | −1.817 | 0.423 | 4.104 | 0.852 | −0.064 | 4.104 |
| 1.567 | −0.255 | 4.104 | −1.818 | 0.429 | 4.104 | 0.967 | −0.077 | 4.104 |
| 1.472 | −0.261 | 4.104 | −1.818 | 0.432 | 4.104 | 1.079 | −0.089 | 4.104 |
| 1.374 | −0.268 | 4.104 | −1.817 | 0.434 | 4.104 | 1.186 | −0.100 | 4.104 |
| 1.271 | −0.274 | 4.104 | −1.817 | 0.435 | 4.104 | 1.290 | −0.110 | 4.104 |
| 1.165 | −0.280 | 4.104 | −1.817 | 0.435 | 4.104 | 1.390 | −0.118 | 4.104 |
| 1.054 | −0.285 | 4.104 | −1.816 | 0.437 | 4.104 | 1.486 | −0.125 | 4.104 |
| 0.940 | −0.288 | 4.104 | −1.813 | 0.439 | 4.104 | 1.578 | −0.132 | 4.104 |
| 0.821 | −0.290 | 4.104 | −1.808 | 0.442 | 4.104 | 1.662 | −0.137 | 4.104 |
| 0.698 | −0.291 | 4.104 | −1.798 | 0.445 | 4.104 | 1.737 | −0.141 | 4.104 |
| 0.576 | −0.289 | 4.104 | −1.780 | 0.445 | 4.104 | 1.805 | −0.144 | 4.104 |
| 0.454 | −0.285 | 4.104 | −1.756 | 0.442 | 4.104 | 1.866 | −0.147 | 4.104 |
| 0.332 | −0.279 | 4.104 | −1.725 | 0.434 | 4.104 | 1.918 | −0.150 | 4.104 |
| 0.210 | −0.271 | 4.104 | −1.686 | 0.423 | 4.104 | 1.962 | −0.152 | 4.104 |

TABLE 5R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.088 | −0.260 | 4.104 | −1.636 | 0.409 | 4.104 | 1.999 | −0.153 | 4.104 |
| −0.033 | −0.246 | 4.104 | −1.578 | 0.394 | 4.104 | 2.031 | −0.154 | 4.104 |
| −0.155 | −0.229 | 4.104 | −1.516 | 0.377 | 4.104 | 2.057 | −0.155 | 4.104 |
| −0.276 | −0.210 | 4.104 | −1.447 | 0.358 | 4.104 | 2.078 | −0.156 | 4.104 |
| −0.396 | −0.187 | 4.104 | −1.369 | 0.337 | 4.104 | 2.094 | −0.157 | 4.104 |
| −0.517 | −0.161 | 4.104 | −1.284 | 0.314 | 4.104 | 2.105 | −0.160 | 4.104 |
| −0.637 | −0.131 | 4.104 | −1.195 | 0.291 | 4.104 | 2.112 | −0.167 | 4.104 |
| −0.753 | −0.099 | 4.104 | −1.101 | 0.269 | 4.104 | 2.116 | −0.175 | 4.104 |
| −0.865 | −0.065 | 4.104 | −1.004 | 0.246 | 4.104 | | | |
| −0.971 | −0.030 | 4.104 | −0.902 | 0.224 | 4.104 | | | |
| 2.104 | −0.542 | 5.862 | −0.962 | −0.078 | 5.862 | −0.696 | 0.051 | 5.862 |
| 2.103 | −0.548 | 5.862 | −1.053 | −0.037 | 5.862 | −0.590 | 0.023 | 5.862 |
| 2.099 | −0.555 | 5.862 | −1.140 | 0.004 | 5.862 | −0.481 | −0.006 | 5.862 |
| 2.091 | −0.561 | 5.862 | −1.222 | 0.045 | 5.862 | −0.368 | −0.035 | 5.862 |
| 2.079 | −0.562 | 5.862 | −1.300 | 0.086 | 5.862 | −0.254 | −0.063 | 5.862 |
| 2.064 | −0.562 | 5.862 | −1.370 | 0.125 | 5.862 | −0.140 | −0.090 | 5.862 |
| 2.043 | −0.562 | 5.862 | −1.432 | 0.161 | 5.862 | −0.026 | −0.117 | 5.862 |
| 2.017 | −0.562 | 5.862 | −1.486 | 0.195 | 5.862 | 0.087 | −0.144 | 5.862 |
| 1.986 | −0.561 | 5.862 | −1.537 | 0.227 | 5.862 | 0.201 | −0.170 | 5.862 |
| 1.948 | −0.561 | 5.862 | −1.580 | 0.256 | 5.862 | 0.316 | −0.196 | 5.862 |
| 1.905 | −0.560 | 5.862 | −1.613 | 0.279 | 5.862 | 0.430 | −0.221 | 5.862 |
| 1.853 | −0.559 | 5.862 | −1.638 | 0.298 | 5.862 | 0.544 | −0.246 | 5.862 |
| 1.793 | −0.558 | 5.862 | −1.656 | 0.314 | 5.862 | 0.658 | −0.271 | 5.862 |
| 1.726 | −0.557 | 5.862 | −1.667 | 0.328 | 5.862 | 0.773 | −0.295 | 5.862 |
| 1.650 | −0.555 | 5.862 | −1.671 | 0.338 | 5.862 | 0.887 | −0.318 | 5.862 |
| 1.567 | −0.552 | 5.862 | −1.672 | 0.344 | 5.862 | 0.998 | −0.340 | 5.862 |
| 1.476 | −0.549 | 5.862 | −1.672 | 0.347 | 5.862 | 1.106 | −0.361 | 5.862 |
| 1.380 | −0.545 | 5.862 | −1.671 | 0.349 | 5.862 | 1.209 | −0.381 | 5.862 |
| 1.281 | −0.541 | 5.862 | −1.671 | 0.349 | 5.862 | 1.309 | −0.399 | 5.862 |
| 1.178 | −0.536 | 5.862 | −1.670 | 0.350 | 5.862 | 1.405 | −0.416 | 5.862 |
| 1.071 | −0.529 | 5.862 | −1.669 | 0.351 | 5.862 | 1.497 | −0.431 | 5.862 |
| 0.960 | −0.522 | 5.862 | −1.667 | 0.353 | 5.862 | 1.586 | −0.446 | 5.862 |
| 0.846 | −0.512 | 5.862 | −1.661 | 0.356 | 5.862 | 1.667 | −0.459 | 5.862 |
| 0.728 | −0.501 | 5.862 | −1.651 | 0.357 | 5.862 | 1.740 | −0.470 | 5.862 |
| 0.610 | −0.488 | 5.862 | −1.634 | 0.356 | 5.862 | 1.805 | −0.480 | 5.862 |
| 0.492 | −0.473 | 5.862 | −1.611 | 0.351 | 5.862 | 1.863 | −0.488 | 5.862 |
| 0.375 | −0.455 | 5.862 | −1.581 | 0.341 | 5.862 | 1.913 | −0.495 | 5.862 |
| 0.258 | −0.436 | 5.862 | −1.545 | 0.328 | 5.862 | 1.956 | −0.501 | 5.862 |
| 0.141 | −0.415 | 5.862 | −1.497 | 0.311 | 5.862 | 1.992 | −0.506 | 5.862 |
| 0.024 | −0.391 | 5.862 | −1.442 | 0.291 | 5.862 | 2.023 | −0.511 | 5.862 |
| −0.092 | −0.364 | 5.862 | −1.383 | 0.270 | 5.862 | 2.048 | −0.514 | 5.862 |
| −0.208 | −0.336 | 5.862 | −1.317 | 0.247 | 5.862 | 2.068 | −0.517 | 5.862 |
| −0.323 | −0.304 | 5.862 | −1.243 | 0.221 | 5.862 | 2.083 | −0.519 | 5.862 |
| −0.438 | −0.271 | 5.862 | −1.162 | 0.193 | 5.862 | 2.094 | −0.522 | 5.862 |
| −0.552 | −0.234 | 5.862 | −1.077 | 0.165 | 5.862 | 2.101 | −0.529 | 5.862 |
| −0.661 | −0.196 | 5.862 | −0.987 | 0.137 | 5.862 | 2.104 | −0.536 | 5.862 |
| −0.766 | −0.158 | 5.862 | −0.894 | 0.109 | 5.862 | | | |
| −0.867 | −0.118 | 5.862 | −0.797 | 0.080 | 5.862 | | | |
| 2.116 | −0.796 | 7.035 | −0.854 | −0.144 | 7.035 | −0.611 | −0.094 | 7.035 |
| 2.114 | −0.802 | 7.035 | −0.942 | −0.103 | 7.035 | −0.510 | −0.128 | 7.035 |
| 2.109 | −0.808 | 7.035 | −1.026 | −0.062 | 7.035 | −0.404 | −0.163 | 7.035 |
| 2.101 | −0.812 | 7.035 | −1.105 | −0.021 | 7.035 | −0.294 | −0.197 | 7.035 |
| 2.089 | −0.812 | 7.035 | −1.181 | 0.019 | 7.035 | −0.184 | −0.231 | 7.035 |
| 2.074 | −0.811 | 7.035 | −1.249 | 0.057 | 7.035 | −0.074 | −0.264 | 7.035 |
| 2.054 | −0.809 | 7.035 | −1.310 | 0.091 | 7.035 | 0.037 | −0.296 | 7.035 |
| 2.029 | −0.806 | 7.035 | −1.363 | 0.123 | 7.035 | 0.147 | −0.327 | 7.035 |
| 1.998 | −0.803 | 7.035 | −1.413 | 0.154 | 7.035 | 0.258 | −0.357 | 7.035 |
| 1.962 | −0.800 | 7.035 | −1.456 | 0.181 | 7.035 | 0.369 | −0.387 | 7.035 |
| 1.919 | −0.795 | 7.035 | −1.488 | 0.202 | 7.035 | 0.481 | −0.417 | 7.035 |
| 1.869 | −0.790 | 7.035 | −1.513 | 0.220 | 7.035 | 0.592 | −0.446 | 7.035 |
| 1.811 | −0.784 | 7.035 | −1.531 | 0.236 | 7.035 | 0.704 | −0.474 | 7.035 |
| 1.746 | −0.776 | 7.035 | −1.542 | 0.249 | 7.035 | 0.815 | −0.502 | 7.035 |
| 1.672 | −0.768 | 7.035 | −1.547 | 0.258 | 7.035 | 0.927 | −0.529 | 7.035 |
| 1.591 | −0.759 | 7.035 | −1.548 | 0.264 | 7.035 | 1.035 | −0.555 | 7.035 |
| 1.503 | −0.748 | 7.035 | −1.547 | 0.267 | 7.035 | 1.140 | −0.579 | 7.035 |
| 1.410 | −0.736 | 7.035 | −1.547 | 0.268 | 7.035 | 1.241 | −0.602 | 7.035 |
| 1.314 | −0.724 | 7.035 | −1.546 | 0.269 | 7.035 | 1.338 | −0.624 | 7.035 |
| 1.214 | −0.710 | 7.035 | −1.546 | 0.270 | 7.035 | 1.432 | −0.644 | 7.035 |
| 1.111 | −0.695 | 7.035 | −1.545 | 0.271 | 7.035 | 1.522 | −0.663 | 7.035 |
| 1.003 | −0.678 | 7.035 | −1.543 | 0.273 | 7.035 | 1.609 | −0.681 | 7.035 |
| 0.892 | −0.660 | 7.035 | −1.537 | 0.275 | 7.035 | 1.688 | −0.696 | 7.035 |
| 0.778 | −0.640 | 7.035 | −1.527 | 0.275 | 7.035 | 1.759 | −0.710 | 7.035 |
| 0.664 | −0.618 | 7.035 | −1.510 | 0.273 | 7.035 | 1.823 | −0.723 | 7.035 |
| 0.550 | −0.595 | 7.035 | −1.488 | 0.265 | 7.035 | 1.880 | −0.734 | 7.035 |
| 0.436 | −0.570 | 7.035 | −1.460 | 0.253 | 7.035 | 1.929 | −0.743 | 7.035 |
| 0.323 | −0.543 | 7.035 | −1.425 | 0.237 | 7.035 | 1.970 | −0.751 | 7.035 |
| 0.209 | −0.514 | 7.035 | −1.379 | 0.216 | 7.035 | 2.006 | −0.757 | 7.035 |

TABLE 5R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.097 | −0.484 | 7.035 | −1.327 | 0.192 | 7.035 | 2.036 | −0.762 | 7.035 |
| −0.015 | −0.452 | 7.035 | −1.271 | 0.167 | 7.035 | 2.060 | −0.767 | 7.035 |
| −0.127 | −0.418 | 7.035 | −1.208 | 0.139 | 7.035 | 2.080 | −0.770 | 7.035 |
| −0.238 | −0.382 | 7.035 | −1.137 | 0.109 | 7.035 | 2.095 | −0.773 | 7.035 |
| −0.348 | −0.345 | 7.035 | −1.059 | 0.076 | 7.035 | 2.106 | −0.776 | 7.035 |
| −0.458 | −0.306 | 7.035 | −0.978 | 0.043 | 7.035 | 2.113 | −0.783 | 7.035 |
| −0.563 | −0.266 | 7.035 | −0.892 | 0.009 | 7.035 | 2.116 | −0.790 | 7.035 |
| −0.664 | −0.225 | 7.035 | −0.802 | −0.025 | 7.035 | | | |
| −0.761 | −0.184 | 7.035 | −0.709 | −0.059 | 7.035 | | | |
| 2.130 | −1.022 | 8.207 | −0.762 | −0.196 | 8.207 | −0.535 | −0.185 | 8.207 |
| 2.128 | −1.027 | 8.207 | −0.848 | −0.152 | 8.207 | −0.436 | −0.224 | 8.207 |
| 2.123 | −1.033 | 8.207 | −0.930 | −0.109 | 8.207 | −0.333 | −0.264 | 8.207 |
| 2.114 | −1.037 | 8.207 | −1.008 | −0.067 | 8.207 | −0.226 | −0.305 | 8.207 |
| 2.103 | −1.036 | 8.207 | −1.081 | −0.025 | 8.207 | −0.119 | −0.344 | 8.207 |
| 2.088 | −1.033 | 8.207 | −1.148 | 0.014 | 8.207 | −0.011 | −0.382 | 8.207 |
| 2.068 | −1.030 | 8.207 | −1.207 | 0.050 | 8.207 | 0.097 | −0.419 | 8.207 |
| 2.044 | −1.025 | 8.207 | −1.259 | 0.083 | 8.207 | 0.205 | −0.455 | 8.207 |
| 2.014 | −1.020 | 8.207 | −1.308 | 0.114 | 8.207 | 0.313 | −0.491 | 8.207 |
| 1.978 | −1.014 | 8.207 | −1.349 | 0.142 | 8.207 | 0.422 | −0.526 | 8.207 |
| 1.937 | −1.006 | 8.207 | −1.381 | 0.164 | 8.207 | 0.531 | −0.560 | 8.207 |
| 1.887 | −0.997 | 8.207 | −1.406 | 0.182 | 8.207 | 0.640 | −0.594 | 8.207 |
| 1.831 | −0.987 | 8.207 | −1.424 | 0.197 | 8.207 | 0.749 | −0.627 | 8.207 |
| 1.766 | −0.975 | 8.207 | −1.435 | 0.210 | 8.207 | 0.858 | −0.660 | 8.207 |
| 1.695 | −0.961 | 8.207 | −1.439 | 0.219 | 8.207 | 0.968 | −0.692 | 8.207 |
| 1.615 | −0.946 | 8.207 | −1.440 | 0.225 | 8.207 | 1.074 | −0.723 | 8.207 |
| 1.529 | −0.929 | 8.207 | −1.440 | 0.228 | 8.207 | 1.176 | −0.753 | 8.207 |
| 1.438 | −0.911 | 8.207 | −1.439 | 0.229 | 8.207 | 1.275 | −0.781 | 8.207 |
| 1.344 | −0.892 | 8.207 | −1.439 | 0.230 | 8.207 | 1.371 | −0.807 | 8.207 |
| 1.247 | −0.872 | 8.207 | −1.438 | 0.231 | 8.207 | 1.462 | −0.832 | 8.207 |
| 1.145 | −0.850 | 8.207 | −1.437 | 0.232 | 8.207 | 1.551 | −0.856 | 8.207 |
| 1.041 | −0.826 | 8.207 | −1.435 | 0.233 | 8.207 | 1.635 | −0.878 | 8.207 |
| 0.933 | −0.800 | 8.207 | −1.429 | 0.235 | 8.207 | 1.712 | −0.899 | 8.207 |
| 0.821 | −0.772 | 8.207 | −1.419 | 0.235 | 8.207 | 1.783 | −0.917 | 8.207 |
| 0.710 | −0.743 | 8.207 | −1.402 | 0.230 | 8.207 | 1.845 | −0.933 | 8.207 |
| 0.599 | −0.713 | 8.207 | −1.381 | 0.222 | 8.207 | 1.901 | −0.947 | 8.207 |
| 0.489 | −0.681 | 8.207 | −1.354 | 0.208 | 8.207 | 1.949 | −0.959 | 8.207 |
| 0.379 | −0.647 | 8.207 | −1.321 | 0.189 | 8.207 | 1.989 | −0.969 | 8.207 |
| 0.270 | −0.612 | 8.207 | −1.277 | 0.166 | 8.207 | 2.024 | −0.977 | 8.207 |
| 0.161 | −0.576 | 8.207 | −1.227 | 0.139 | 8.207 | 2.053 | −0.984 | 8.207 |
| 0.052 | −0.538 | 8.207 | −1.173 | 0.111 | 8.207 | 2.077 | −0.990 | 8.207 |
| −0.056 | −0.499 | 8.207 | −1.112 | 0.079 | 8.207 | 2.097 | −0.994 | 8.207 |
| −0.163 | −0.458 | 8.207 | −1.044 | 0.045 | 8.207 | 2.111 | −0.998 | 8.207 |
| −0.271 | −0.416 | 8.207 | −0.969 | 0.008 | 8.207 | 2.122 | −1.002 | 8.207 |
| −0.377 | −0.372 | 8.207 | −0.890 | −0.029 | 8.207 | 2.128 | −1.009 | 8.207 |
| −0.480 | −0.328 | 8.207 | −0.807 | −0.067 | 8.207 | 2.131 | −1.016 | 8.207 |
| −0.578 | −0.284 | 8.207 | −0.720 | −0.106 | 8.207 | | | |
| −0.672 | −0.240 | 8.207 | −0.629 | −0.145 | 8.207 | | | |
| 2.156 | −1.202 | 8.794 | −0.761 | −0.197 | 8.794 | −0.530 | −0.205 | 8.794 |
| 2.154 | −1.207 | 8.794 | −0.846 | −0.146 | 8.794 | −0.431 | −0.252 | 8.794 |
| 2.149 | −1.213 | 8.794 | −0.926 | −0.096 | 8.794 | −0.329 | −0.300 | 8.794 |
| 2.140 | −1.216 | 8.794 | −1.003 | −0.046 | 8.794 | −0.222 | −0.348 | 8.794 |
| 2.128 | −1.215 | 8.794 | −1.075 | 0.003 | 8.794 | −0.114 | −0.394 | 8.794 |
| 2.113 | −1.212 | 8.794 | −1.140 | 0.048 | 8.794 | −0.006 | −0.440 | 8.794 |
| 2.092 | −1.208 | 8.794 | −1.198 | 0.090 | 8.794 | 0.102 | −0.484 | 8.794 |
| 2.067 | −1.202 | 8.794 | −1.248 | 0.127 | 8.794 | 0.211 | −0.528 | 8.794 |
| 2.037 | −1.196 | 8.794 | −1.295 | 0.164 | 8.794 | 0.320 | −0.570 | 8.794 |
| 2.000 | −1.188 | 8.794 | −1.336 | 0.195 | 8.794 | 0.429 | −0.612 | 8.794 |
| 1.958 | −1.179 | 8.794 | −1.367 | 0.220 | 8.794 | 0.539 | −0.653 | 8.794 |
| 1.908 | −1.168 | 8.794 | −1.391 | 0.241 | 8.794 | 0.649 | −0.693 | 8.794 |
| 1.850 | −1.156 | 8.794 | −1.408 | 0.258 | 8.794 | 0.759 | −0.733 | 8.794 |
| 1.784 | −1.141 | 8.794 | −1.418 | 0.272 | 8.794 | 0.869 | −0.772 | 8.794 |
| 1.711 | −1.125 | 8.794 | −1.422 | 0.281 | 8.794 | 0.980 | −0.811 | 8.794 |
| 1.630 | −1.106 | 8.794 | −1.423 | 0.287 | 8.794 | 1.087 | −0.848 | 8.794 |
| 1.542 | −1.086 | 8.794 | −1.423 | 0.290 | 8.794 | 1.190 | −0.883 | 8.794 |
| 1.449 | −1.063 | 8.794 | −1.422 | 0.292 | 8.794 | 1.290 | −0.916 | 8.794 |
| 1.354 | −1.040 | 8.794 | −1.422 | 0.292 | 8.794 | 1.387 | −0.948 | 8.794 |
| 1.254 | −1.014 | 8.794 | −1.421 | 0.293 | 8.794 | 1.480 | −0.978 | 8.794 |
| 1.151 | −0.987 | 8.794 | −1.420 | 0.294 | 8.794 | 1.569 | −1.007 | 8.794 |
| 1.045 | −0.957 | 8.794 | −1.417 | 0.295 | 8.794 | 1.654 | −1.034 | 8.794 |
| 0.936 | −0.925 | 8.794 | −1.411 | 0.296 | 8.794 | 1.733 | −1.058 | 8.794 |
| 0.823 | −0.891 | 8.794 | −1.401 | 0.295 | 8.794 | 1.804 | −1.080 | 8.794 |
| 0.711 | −0.855 | 8.794 | −1.384 | 0.289 | 8.794 | 1.867 | −1.099 | 8.794 |
| 0.599 | −0.817 | 8.794 | −1.364 | 0.278 | 8.794 | 1.923 | −1.116 | 8.794 |
| 0.488 | −0.778 | 8.794 | −1.338 | 0.261 | 8.794 | 1.972 | −1.130 | 8.794 |
| 0.378 | −0.736 | 8.794 | −1.305 | 0.239 | 8.794 | 2.013 | −1.142 | 8.794 |
| 0.268 | −0.694 | 8.794 | −1.262 | 0.211 | 8.794 | 2.049 | −1.152 | 8.794 |
| 0.159 | −0.650 | 8.794 | −1.213 | 0.180 | 8.794 | 2.078 | −1.160 | 8.794 |

TABLE 5R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.050 | −0.604 | 8.794 | −1.160 | 0.146 | 8.794 | 2.103 | −1.167 | 8.794 |
| −0.058 | −0.557 | 8.794 | −1.100 | 0.109 | 8.794 | 2.122 | −1.172 | 8.794 |
| −0.166 | −0.508 | 8.794 | −1.034 | 0.069 | 8.794 | 2.137 | −1.177 | 8.794 |
| −0.273 | −0.458 | 8.794 | −0.960 | 0.025 | 8.794 | 2.148 | −1.181 | 8.794 |
| −0.379 | −0.405 | 8.794 | −0.882 | −0.020 | 8.794 | 2.155 | −1.188 | 8.794 |
| −0.481 | −0.353 | 8.794 | −0.800 | −0.065 | 8.794 | 2.157 | −1.196 | 8.794 |
| −0.579 | −0.301 | 8.794 | −0.714 | −0.111 | 8.794 | | | |
| −0.672 | −0.249 | 8.794 | −0.624 | −0.158 | 8.794 | | | |
| 2.185 | −1.326 | 9.087 | −0.793 | −0.169 | 9.087 | −0.557 | −0.197 | 9.087 |
| 2.183 | −1.331 | 9.087 | −0.877 | −0.109 | 9.087 | −0.458 | −0.252 | 9.087 |
| 2.177 | −1.337 | 9.087 | −0.956 | −0.051 | 9.087 | −0.355 | −0.308 | 9.087 |
| 2.167 | −1.340 | 9.087 | −1.031 | 0.006 | 9.087 | −0.247 | −0.364 | 9.087 |
| 2.155 | −1.338 | 9.087 | −1.102 | 0.062 | 9.087 | −0.139 | −0.418 | 9.087 |
| 2.139 | −1.335 | 9.087 | −1.166 | 0.114 | 9.087 | −0.030 | −0.471 | 9.087 |
| 2.118 | −1.330 | 9.087 | −1.222 | 0.162 | 9.087 | 0.080 | −0.522 | 9.087 |
| 2.092 | −1.325 | 9.087 | −1.271 | 0.205 | 9.087 | 0.190 | −0.572 | 9.087 |
| 2.061 | −1.318 | 9.087 | −1.317 | 0.247 | 9.087 | 0.301 | −0.621 | 9.087 |
| 2.023 | −1.309 | 9.087 | −1.356 | 0.283 | 9.087 | 0.413 | −0.668 | 9.087 |
| 1.979 | −1.299 | 9.087 | −1.386 | 0.311 | 9.087 | 0.524 | −0.715 | 9.087 |
| 1.927 | −1.287 | 9.087 | −1.409 | 0.334 | 9.087 | 0.637 | −0.761 | 9.087 |
| 1.867 | −1.273 | 9.087 | −1.426 | 0.352 | 9.087 | 0.749 | −0.805 | 9.087 |
| 1.800 | −1.257 | 9.087 | −1.436 | 0.368 | 9.087 | 0.862 | −0.850 | 9.087 |
| 1.724 | −1.239 | 9.087 | −1.439 | 0.378 | 9.087 | 0.976 | −0.893 | 9.087 |
| 1.640 | −1.219 | 9.087 | −1.440 | 0.384 | 9.087 | 1.085 | −0.934 | 9.087 |
| 1.549 | −1.196 | 9.087 | −1.439 | 0.387 | 9.087 | 1.192 | −0.974 | 9.087 |
| 1.454 | −1.171 | 9.087 | −1.438 | 0.389 | 9.087 | 1.294 | −1.011 | 9.087 |
| 1.355 | −1.144 | 9.087 | −1.438 | 0.389 | 9.087 | 1.393 | −1.047 | 9.087 |
| 1.253 | −1.116 | 9.087 | −1.437 | 0.390 | 9.087 | 1.488 | −1.080 | 9.087 |
| 1.147 | −1.085 | 9.087 | −1.436 | 0.391 | 9.087 | 1.580 | −1.112 | 9.087 |
| 1.038 | −1.051 | 9.087 | −1.433 | 0.392 | 9.087 | 1.668 | −1.142 | 9.087 |
| 0.925 | −1.014 | 9.087 | −1.426 | 0.392 | 9.087 | 1.749 | −1.169 | 9.087 |
| 0.810 | −0.975 | 9.087 | −1.416 | 0.390 | 9.087 | 1.822 | −1.193 | 9.087 |
| 0.695 | −0.933 | 9.087 | −1.400 | 0.382 | 9.087 | 1.887 | −1.214 | 9.087 |
| 0.581 | −0.889 | 9.087 | −1.380 | 0.368 | 9.087 | 1.945 | −1.232 | 9.087 |
| 0.468 | −0.844 | 9.087 | −1.354 | 0.348 | 9.087 | 1.995 | −1.248 | 9.087 |
| 0.355 | −0.796 | 9.087 | −1.323 | 0.323 | 9.087 | 2.037 | −1.261 | 9.087 |
| 0.243 | −0.746 | 9.087 | −1.281 | 0.291 | 9.087 | 2.074 | −1.272 | 9.087 |
| 0.132 | −0.695 | 9.087 | −1.233 | 0.254 | 9.087 | 2.104 | −1.282 | 9.087 |
| 0.021 | −0.642 | 9.087 | −1.181 | 0.214 | 9.087 | 2.129 | −1.289 | 9.087 |
| −0.088 | −0.587 | 9.087 | −1.123 | 0.171 | 9.087 | 2.150 | −1.295 | 9.087 |
| −0.197 | −0.530 | 9.087 | −1.057 | 0.124 | 9.087 | 2.165 | −1.300 | 9.087 |
| −0.305 | −0.471 | 9.087 | −0.984 | 0.073 | 9.087 | 2.176 | −1.304 | 9.087 |
| −0.412 | −0.410 | 9.087 | −0.907 | 0.021 | 9.087 | 2.183 | −1.312 | 9.087 |
| −0.515 | −0.350 | 9.087 | −0.826 | −0.032 | 9.087 | 2.186 | −1.319 | 9.087 |
| −0.612 | −0.289 | 9.087 | −0.741 | −0.087 | 9.087 | | | |
| −0.705 | −0.229 | 9.087 | −0.651 | −0.141 | 9.087 | | | |
| 2.219 | −1.466 | 9.380 | −0.838 | −0.126 | 9.380 | −0.599 | −0.178 | 9.380 |
| 2.217 | −1.472 | 9.380 | −0.921 | −0.057 | 9.380 | −0.501 | −0.243 | 9.380 |
| 2.211 | −1.478 | 9.380 | −0.999 | 0.011 | 9.380 | −0.397 | −0.309 | 9.380 |
| 2.200 | −1.481 | 9.380 | −1.072 | 0.077 | 9.380 | −0.289 | −0.375 | 9.380 |
| 2.188 | −1.478 | 9.380 | −1.141 | 0.142 | 9.380 | −0.179 | −0.439 | 9.380 |
| 2.171 | −1.475 | 9.380 | −1.202 | 0.202 | 9.380 | −0.068 | −0.500 | 9.380 |
| 2.149 | −1.470 | 9.380 | −1.257 | 0.257 | 9.380 | 0.044 | −0.560 | 9.380 |
| 2.122 | −1.463 | 9.380 | −1.305 | 0.306 | 9.380 | 0.156 | −0.618 | 9.380 |
| 2.089 | −1.456 | 9.380 | −1.349 | 0.354 | 9.380 | 0.270 | −0.675 | 9.380 |
| 2.050 | −1.447 | 9.380 | −1.386 | 0.395 | 9.380 | 0.384 | −0.730 | 9.380 |
| 2.004 | −1.436 | 9.380 | −1.415 | 0.427 | 9.380 | 0.499 | −0.783 | 9.380 |
| 1.949 | −1.423 | 9.380 | −1.437 | 0.453 | 9.380 | 0.615 | −0.835 | 9.380 |
| 1.887 | −1.407 | 9.380 | −1.453 | 0.474 | 9.380 | 0.731 | −0.886 | 9.380 |
| 1.816 | −1.389 | 9.380 | −1.462 | 0.491 | 9.380 | 0.847 | −0.937 | 9.380 |
| 1.737 | −1.369 | 9.380 | −1.465 | 0.501 | 9.380 | 0.964 | −0.986 | 9.380 |
| 1.650 | −1.347 | 9.380 | −1.465 | 0.508 | 9.380 | 1.078 | −1.032 | 9.380 |
| 1.555 | −1.321 | 9.380 | −1.464 | 0.511 | 9.380 | 1.188 | −1.076 | 9.380 |
| 1.455 | −1.294 | 9.380 | −1.463 | 0.513 | 9.380 | 1.294 | −1.118 | 9.380 |
| 1.353 | −1.264 | 9.380 | −1.463 | 0.513 | 9.380 | 1.396 | −1.158 | 9.380 |
| 1.246 | −1.231 | 9.380 | −1.462 | 0.514 | 9.380 | 1.495 | −1.196 | 9.380 |
| 1.137 | −1.196 | 9.380 | −1.461 | 0.515 | 9.380 | 1.590 | −1.231 | 9.380 |
| 1.023 | −1.157 | 9.380 | −1.457 | 0.516 | 9.380 | 1.681 | −1.265 | 9.380 |
| 0.907 | −1.115 | 9.380 | −1.450 | 0.515 | 9.380 | 1.765 | −1.295 | 9.380 |
| 0.788 | −1.069 | 9.380 | −1.441 | 0.511 | 9.380 | 1.841 | −1.322 | 9.380 |
| 0.669 | −1.021 | 9.380 | −1.425 | 0.500 | 9.380 | 1.909 | −1.345 | 9.380 |
| 0.552 | −0.970 | 9.380 | −1.406 | 0.484 | 9.380 | 1.969 | −1.365 | 9.380 |
| 0.435 | −0.916 | 9.380 | −1.381 | 0.460 | 9.380 | 2.021 | −1.383 | 9.380 |
| 0.320 | −0.861 | 9.380 | −1.351 | 0.431 | 9.380 | 2.065 | −1.397 | 9.380 |
| 0.205 | −0.803 | 9.380 | −1.311 | 0.393 | 9.380 | 2.103 | −1.410 | 9.380 |
| 0.091 | −0.743 | 9.380 | −1.264 | 0.350 | 9.380 | 2.135 | −1.420 | 9.380 |
| −0.022 | −0.680 | 9.380 | −1.214 | 0.305 | 9.380 | 2.161 | −1.428 | 9.380 |

TABLE 5R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.133 | −0.616 | 9.380 | −1.157 | 0.254 | 9.380 | 2.182 | −1.435 | 9.380 |
| −0.244 | −0.549 | 9.380 | −1.093 | 0.199 | 9.380 | 2.198 | −1.440 | 9.380 |
| −0.352 | −0.481 | 9.380 | −1.022 | 0.139 | 9.380 | 2.210 | −1.445 | 9.380 |
| −0.460 | −0.409 | 9.380 | −0.946 | 0.078 | 9.380 | 2.217 | −1.452 | 9.380 |
| −0.562 | −0.338 | 9.380 | −0.866 | 0.015 | 9.380 | 2.220 | −1.460 | 9.380 |
| −0.659 | −0.267 | 9.380 | −0.782 | −0.048 | 9.380 | | | |
| −0.751 | −0.196 | 9.380 | −0.693 | −0.113 | 9.380 | | | |

The coordinate values given in TABLE 6R below provide the nominal profile envelope for an exemplary sixth stage rotor.

TABLE 6R

| X-LOC | Y-LOC | Z-LOC | X-LOC | Y-LOC | Z-LOC | X-LOC | Y-LOC | Z-LOC |
|---|---|---|---|---|---|---|---|---|
| 1.674 | 0.308 | 0.000 | −0.896 | −0.227 | 0.000 | −0.657 | 0.055 | 0.000 |
| 1.675 | 0.303 | 0.000 | −0.976 | −0.198 | 0.000 | −0.568 | 0.052 | 0.000 |
| 1.674 | 0.297 | 0.000 | −1.052 | −0.167 | 0.000 | −0.476 | 0.052 | 0.000 |
| 1.670 | 0.289 | 0.000 | −1.123 | −0.133 | 0.000 | −0.381 | 0.055 | 0.000 |
| 1.662 | 0.283 | 0.000 | −1.187 | −0.099 | 0.000 | −0.285 | 0.060 | 0.000 |
| 1.649 | 0.278 | 0.000 | −1.244 | −0.066 | 0.000 | −0.189 | 0.068 | 0.000 |
| 1.633 | 0.271 | 0.000 | −1.293 | −0.035 | 0.000 | −0.094 | 0.077 | 0.000 |
| 1.612 | 0.262 | 0.000 | −1.336 | −0.005 | 0.000 | 0.002 | 0.087 | 0.000 |
| 1.587 | 0.252 | 0.000 | −1.371 | 0.023 | 0.000 | 0.097 | 0.098 | 0.000 |
| 1.558 | 0.239 | 0.000 | −1.400 | 0.048 | 0.000 | 0.192 | 0.110 | 0.000 |
| 1.523 | 0.225 | 0.000 | −1.424 | 0.069 | 0.000 | 0.288 | 0.122 | 0.000 |
| 1.482 | 0.208 | 0.000 | −1.444 | 0.089 | 0.000 | 0.383 | 0.135 | 0.000 |
| 1.434 | 0.188 | 0.000 | −1.459 | 0.106 | 0.000 | 0.478 | 0.147 | 0.000 |
| 1.381 | 0.166 | 0.000 | −1.469 | 0.120 | 0.000 | 0.573 | 0.160 | 0.000 |
| 1.320 | 0.142 | 0.000 | −1.477 | 0.132 | 0.000 | 0.668 | 0.173 | 0.000 |
| 1.254 | 0.115 | 0.000 | −1.481 | 0.141 | 0.000 | 0.760 | 0.185 | 0.000 |
| 1.181 | 0.086 | 0.000 | −1.483 | 0.149 | 0.000 | 0.849 | 0.197 | 0.000 |
| 1.105 | 0.055 | 0.000 | −1.483 | 0.156 | 0.000 | 0.934 | 0.208 | 0.000 |
| 1.025 | 0.024 | 0.000 | −1.482 | 0.161 | 0.000 | 1.017 | 0.220 | 0.000 |
| 0.942 | −0.008 | 0.000 | −1.479 | 0.165 | 0.000 | 1.096 | 0.231 | 0.000 |
| 0.856 | −0.041 | 0.000 | −1.473 | 0.169 | 0.000 | 1.172 | 0.243 | 0.000 |
| 0.767 | −0.075 | 0.000 | −1.466 | 0.171 | 0.000 | 1.244 | 0.254 | 0.000 |
| 0.673 | −0.108 | 0.000 | −1.456 | 0.173 | 0.000 | 1.311 | 0.265 | 0.000 |
| 0.577 | −0.142 | 0.000 | −1.444 | 0.174 | 0.000 | 1.371 | 0.275 | 0.000 |
| 0.480 | −0.174 | 0.000 | −1.427 | 0.173 | 0.000 | 1.424 | 0.283 | 0.000 |
| 0.382 | −0.205 | 0.000 | −1.406 | 0.171 | 0.000 | 1.472 | 0.291 | 0.000 |
| 0.283 | −0.233 | 0.000 | −1.381 | 0.168 | 0.000 | 1.513 | 0.298 | 0.000 |
| 0.184 | −0.258 | 0.000 | −1.352 | 0.163 | 0.000 | 1.547 | 0.305 | 0.000 |
| 0.083 | −0.280 | 0.000 | −1.317 | 0.156 | 0.000 | 1.577 | 0.310 | 0.000 |
| −0.019 | −0.297 | 0.000 | −1.276 | 0.148 | 0.000 | 1.602 | 0.314 | 0.000 |
| −0.120 | −0.309 | 0.000 | −1.229 | 0.138 | 0.000 | 1.622 | 0.318 | 0.000 |
| −0.223 | −0.317 | 0.000 | −1.176 | 0.127 | 0.000 | 1.639 | 0.321 | 0.000 |
| −0.325 | −0.319 | 0.000 | −1.117 | 0.114 | 0.000 | 1.651 | 0.323 | 0.000 |
| −0.427 | −0.316 | 0.000 | −1.051 | 0.102 | 0.000 | 1.661 | 0.322 | 0.000 |
| −0.529 | −0.307 | 0.000 | −0.979 | 0.089 | 0.000 | 1.668 | 0.318 | 0.000 |
| −0.628 | −0.293 | 0.000 | −0.903 | 0.078 | 0.000 | 1.672 | 0.313 | 0.000 |
| −0.722 | −0.275 | 0.000 | −0.825 | 0.069 | 0.000 | | | |
| −0.812 | −0.253 | 0.000 | −0.743 | 0.061 | 0.000 | | | |
| 1.687 | 0.265 | 0.796 | −0.867 | −0.228 | 0.796 | −0.652 | 0.045 | 0.796 |
| 1.688 | 0.260 | 0.796 | −0.948 | −0.206 | 0.796 | −0.562 | 0.044 | 0.796 |
| 1.687 | 0.253 | 0.796 | −1.025 | −0.183 | 0.796 | −0.469 | 0.044 | 0.796 |
| 1.682 | 0.246 | 0.796 | −1.097 | −0.157 | 0.796 | −0.373 | 0.046 | 0.796 |
| 1.674 | 0.240 | 0.796 | −1.163 | −0.131 | 0.796 | −0.277 | 0.050 | 0.796 |
| 1.662 | 0.235 | 0.796 | −1.222 | −0.106 | 0.796 | −0.181 | 0.055 | 0.796 |
| 1.645 | 0.229 | 0.796 | −1.274 | −0.081 | 0.796 | −0.085 | 0.063 | 0.796 |
| 1.625 | 0.222 | 0.796 | −1.319 | −0.057 | 0.796 | 0.010 | 0.071 | 0.796 |
| 1.600 | 0.213 | 0.796 | −1.358 | −0.035 | 0.796 | 0.106 | 0.081 | 0.796 |
| 1.570 | 0.202 | 0.796 | −1.390 | −0.016 | 0.796 | 0.201 | 0.091 | 0.796 |
| 1.536 | 0.189 | 0.796 | −1.416 | 0.002 | 0.796 | 0.297 | 0.102 | 0.796 |
| 1.495 | 0.174 | 0.796 | −1.438 | 0.018 | 0.796 | 0.392 | 0.113 | 0.796 |
| 1.447 | 0.157 | 0.796 | −1.455 | 0.033 | 0.796 | 0.487 | 0.124 | 0.796 |
| 1.394 | 0.137 | 0.796 | −1.468 | 0.045 | 0.796 | 0.583 | 0.135 | 0.796 |
| 1.334 | 0.116 | 0.796 | −1.477 | 0.055 | 0.796 | 0.678 | 0.146 | 0.796 |
| 1.267 | 0.093 | 0.796 | −1.483 | 0.064 | 0.796 | 0.770 | 0.157 | 0.796 |
| 1.194 | 0.067 | 0.796 | −1.486 | 0.071 | 0.796 | 0.859 | 0.168 | 0.796 |
| 1.118 | 0.040 | 0.796 | −1.487 | 0.078 | 0.796 | 0.945 | 0.178 | 0.796 |
| 1.039 | 0.013 | 0.796 | −1.486 | 0.083 | 0.796 | 1.028 | 0.188 | 0.796 |

TABLE 6R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.956 | −0.016 | 0.796 | −1.484 | 0.087 | 0.796 | 1.107 | 0.199 | 0.796 |
| 0.870 | −0.045 | 0.796 | −1.479 | 0.092 | 0.796 | 1.183 | 0.209 | 0.796 |
| 0.781 | −0.074 | 0.796 | −1.472 | 0.095 | 0.796 | 1.256 | 0.219 | 0.796 |
| 0.689 | −0.104 | 0.796 | −1.463 | 0.098 | 0.796 | 1.323 | 0.228 | 0.796 |
| 0.593 | −0.134 | 0.796 | −1.450 | 0.100 | 0.796 | 1.383 | 0.237 | 0.796 |
| 0.496 | −0.162 | 0.796 | −1.433 | 0.102 | 0.796 | 1.437 | 0.245 | 0.796 |
| 0.400 | −0.190 | 0.796 | −1.413 | 0.102 | 0.796 | 1.484 | 0.252 | 0.796 |
| 0.302 | −0.215 | 0.796 | −1.387 | 0.101 | 0.796 | 1.526 | 0.258 | 0.796 |
| 0.205 | −0.238 | 0.796 | −1.357 | 0.100 | 0.796 | 1.560 | 0.264 | 0.796 |
| 0.106 | −0.258 | 0.796 | −1.322 | 0.097 | 0.796 | 1.590 | 0.268 | 0.796 |
| 0.006 | −0.274 | 0.796 | −1.281 | 0.093 | 0.796 | 1.615 | 0.272 | 0.796 |
| −0.094 | −0.286 | 0.796 | −1.233 | 0.089 | 0.796 | 1.636 | 0.275 | 0.796 |
| −0.196 | −0.294 | 0.796 | −1.179 | 0.083 | 0.796 | 1.652 | 0.278 | 0.796 |
| −0.298 | −0.297 | 0.796 | −1.118 | 0.077 | 0.796 | 1.665 | 0.280 | 0.796 |
| −0.399 | −0.295 | 0.796 | −1.051 | 0.070 | 0.796 | 1.674 | 0.279 | 0.796 |
| −0.501 | −0.289 | 0.796 | −0.978 | 0.063 | 0.796 | 1.681 | 0.274 | 0.796 |
| −0.599 | −0.279 | 0.796 | −0.901 | 0.057 | 0.796 | 1.685 | 0.269 | 0.796 |
| −0.692 | −0.265 | 0.796 | −0.821 | 0.052 | 0.796 | | | |
| −0.782 | −0.248 | 0.796 | −0.738 | 0.048 | 0.796 | | | |
| 1.693 | 0.239 | 1.061 | −0.864 | −0.220 | 1.061 | −0.653 | 0.044 | 1.061 |
| 1.694 | 0.234 | 1.061 | −0.945 | −0.198 | 1.061 | −0.563 | 0.042 | 1.061 |
| 1.693 | 0.227 | 1.061 | −1.022 | −0.174 | 1.061 | −0.469 | 0.041 | 1.061 |
| 1.688 | 0.220 | 1.061 | −1.096 | −0.149 | 1.061 | −0.373 | 0.042 | 1.061 |
| 1.680 | 0.214 | 1.061 | −1.162 | −0.124 | 1.061 | −0.277 | 0.045 | 1.061 |
| 1.668 | 0.210 | 1.061 | −1.221 | −0.100 | 1.061 | −0.181 | 0.049 | 1.061 |
| 1.651 | 0.204 | 1.061 | −1.274 | −0.076 | 1.061 | −0.085 | 0.055 | 1.061 |
| 1.631 | 0.197 | 1.061 | −1.319 | −0.053 | 1.061 | 0.011 | 0.063 | 1.061 |
| 1.606 | 0.188 | 1.061 | −1.358 | −0.032 | 1.061 | 0.107 | 0.071 | 1.061 |
| 1.576 | 0.178 | 1.061 | −1.391 | −0.013 | 1.061 | 0.203 | 0.080 | 1.061 |
| 1.541 | 0.166 | 1.061 | −1.418 | 0.004 | 1.061 | 0.298 | 0.090 | 1.061 |
| 1.500 | 0.152 | 1.061 | −1.440 | 0.020 | 1.061 | 0.394 | 0.100 | 1.061 |
| 1.452 | 0.135 | 1.061 | −1.457 | 0.034 | 1.061 | 0.490 | 0.111 | 1.061 |
| 1.398 | 0.117 | 1.061 | −1.470 | 0.046 | 1.061 | 0.586 | 0.121 | 1.061 |
| 1.338 | 0.097 | 1.061 | −1.479 | 0.056 | 1.061 | 0.681 | 0.131 | 1.061 |
| 1.271 | 0.074 | 1.061 | −1.485 | 0.064 | 1.061 | 0.774 | 0.141 | 1.061 |
| 1.198 | 0.050 | 1.061 | −1.489 | 0.072 | 1.061 | 0.863 | 0.151 | 1.061 |
| 1.122 | 0.025 | 1.061 | −1.490 | 0.078 | 1.061 | 0.949 | 0.160 | 1.061 |
| 1.042 | −0.001 | 1.061 | −1.489 | 0.083 | 1.061 | 1.032 | 0.170 | 1.061 |
| 0.960 | −0.028 | 1.061 | −1.487 | 0.088 | 1.061 | 1.112 | 0.179 | 1.061 |
| 0.874 | −0.055 | 1.061 | −1.482 | 0.092 | 1.061 | 1.188 | 0.188 | 1.061 |
| 0.784 | −0.083 | 1.061 | −1.475 | 0.096 | 1.061 | 1.261 | 0.198 | 1.061 |
| 0.691 | −0.111 | 1.061 | −1.465 | 0.098 | 1.061 | 1.328 | 0.206 | 1.061 |
| 0.595 | −0.140 | 1.061 | −1.453 | 0.101 | 1.061 | 1.388 | 0.214 | 1.061 |
| 0.499 | −0.167 | 1.061 | −1.436 | 0.102 | 1.061 | 1.442 | 0.222 | 1.061 |
| 0.402 | −0.192 | 1.061 | −1.415 | 0.102 | 1.061 | 1.490 | 0.228 | 1.061 |
| 0.305 | −0.216 | 1.061 | −1.390 | 0.102 | 1.061 | 1.531 | 0.234 | 1.061 |
| 0.207 | −0.238 | 1.061 | −1.360 | 0.100 | 1.061 | 1.566 | 0.239 | 1.061 |
| 0.108 | −0.256 | 1.061 | −1.324 | 0.098 | 1.061 | 1.596 | 0.243 | 1.061 |
| 0.009 | −0.271 | 1.061 | −1.283 | 0.094 | 1.061 | 1.621 | 0.247 | 1.061 |
| −0.092 | −0.282 | 1.061 | −1.235 | 0.089 | 1.061 | 1.642 | 0.250 | 1.061 |
| −0.193 | −0.289 | 1.061 | −1.181 | 0.084 | 1.061 | 1.658 | 0.252 | 1.061 |
| −0.295 | −0.290 | 1.061 | −1.120 | 0.077 | 1.061 | 1.671 | 0.254 | 1.061 |
| −0.396 | −0.288 | 1.061 | −1.053 | 0.071 | 1.061 | 1.681 | 0.253 | 1.061 |
| −0.497 | −0.281 | 1.061 | −0.979 | 0.064 | 1.061 | 1.687 | 0.248 | 1.061 |
| −0.595 | −0.270 | 1.061 | −0.903 | 0.058 | 1.061 | 1.691 | 0.243 | 1.061 |
| −0.689 | −0.256 | 1.061 | −0.822 | 0.052 | 1.061 | | | |
| −0.779 | −0.239 | 1.061 | −0.739 | 0.047 | 1.061 | | | |
| 1.713 | 0.113 | 2.122 | −0.860 | −0.173 | 2.122 | −0.658 | 0.044 | 2.122 |
| 1.713 | 0.108 | 2.122 | −0.942 | −0.150 | 2.122 | −0.567 | 0.037 | 2.122 |
| 1.712 | 0.101 | 2.122 | −1.020 | −0.126 | 2.122 | −0.474 | 0.032 | 2.122 |
| 1.707 | 0.095 | 2.122 | −1.095 | −0.101 | 2.122 | −0.377 | 0.028 | 2.122 |
| 1.699 | 0.090 | 2.122 | −1.162 | −0.077 | 2.122 | −0.280 | 0.025 | 2.122 |
| 1.686 | 0.086 | 2.122 | −1.222 | −0.053 | 2.122 | −0.183 | 0.024 | 2.122 |
| 1.669 | 0.082 | 2.122 | −1.276 | −0.031 | 2.122 | −0.086 | 0.024 | 2.122 |
| 1.648 | 0.076 | 2.122 | −1.322 | −0.009 | 2.122 | 0.011 | 0.026 | 2.122 |
| 1.623 | 0.069 | 2.122 | −1.362 | 0.010 | 2.122 | 0.108 | 0.029 | 2.122 |
| 1.593 | 0.061 | 2.122 | −1.395 | 0.028 | 2.122 | 0.205 | 0.032 | 2.122 |
| 1.557 | 0.052 | 2.122 | −1.423 | 0.044 | 2.122 | 0.302 | 0.037 | 2.122 |
| 1.515 | 0.041 | 2.122 | −1.446 | 0.058 | 2.122 | 0.399 | 0.041 | 2.122 |
| 1.467 | 0.028 | 2.122 | −1.464 | 0.071 | 2.122 | 0.496 | 0.046 | 2.122 |
| 1.412 | 0.014 | 2.122 | −1.478 | 0.082 | 2.122 | 0.593 | 0.051 | 2.122 |
| 1.351 | −0.001 | 2.122 | −1.487 | 0.092 | 2.122 | 0.690 | 0.056 | 2.122 |
| 1.283 | −0.018 | 2.122 | −1.494 | 0.100 | 2.122 | 0.783 | 0.062 | 2.122 |
| 1.209 | −0.037 | 2.122 | −1.498 | 0.107 | 2.122 | 0.874 | 0.067 | 2.122 |
| 1.131 | −0.056 | 2.122 | −1.499 | 0.114 | 2.122 | 0.961 | 0.072 | 2.122 |
| 1.050 | −0.075 | 2.122 | −1.499 | 0.119 | 2.122 | 1.045 | 0.077 | 2.122 |
| 0.966 | −0.096 | 2.122 | −1.496 | 0.123 | 2.122 | 1.125 | 0.082 | 2.122 |

TABLE 6R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.878 | −0.116 | 2.122 | −1.491 | 0.128 | 2.122 | 1.203 | 0.088 | 2.122 |
| 0.788 | −0.137 | 2.122 | −1.484 | 0.131 | 2.122 | 1.277 | 0.094 | 2.122 |
| 0.694 | −0.157 | 2.122 | −1.474 | 0.133 | 2.122 | 1.345 | 0.099 | 2.122 |
| 0.596 | −0.177 | 2.122 | −1.461 | 0.135 | 2.122 | 1.406 | 0.104 | 2.122 |
| 0.499 | −0.196 | 2.122 | −1.445 | 0.136 | 2.122 | 1.461 | 0.109 | 2.122 |
| 0.401 | −0.213 | 2.122 | −1.423 | 0.135 | 2.122 | 1.509 | 0.113 | 2.122 |
| 0.303 | −0.229 | 2.122 | −1.398 | 0.134 | 2.122 | 1.551 | 0.116 | 2.122 |
| 0.205 | −0.243 | 2.122 | −1.368 | 0.131 | 2.122 | 1.586 | 0.120 | 2.122 |
| 0.107 | −0.253 | 2.122 | −1.332 | 0.126 | 2.122 | 1.617 | 0.122 | 2.122 |
| 0.008 | −0.261 | 2.122 | −1.291 | 0.121 | 2.122 | 1.642 | 0.125 | 2.122 |
| −0.091 | −0.265 | 2.122 | −1.243 | 0.114 | 2.122 | 1.663 | 0.127 | 2.122 |
| −0.191 | −0.265 | 2.122 | −1.188 | 0.106 | 2.122 | 1.680 | 0.129 | 2.122 |
| −0.291 | −0.262 | 2.122 | −1.127 | 0.097 | 2.122 | 1.693 | 0.130 | 2.122 |
| −0.391 | −0.255 | 2.122 | −1.060 | 0.088 | 2.122 | 1.702 | 0.128 | 2.122 |
| −0.492 | −0.244 | 2.122 | −0.986 | 0.078 | 2.122 | 1.708 | 0.123 | 2.122 |
| −0.589 | −0.230 | 2.122 | −0.909 | 0.069 | 2.122 | 1.712 | 0.117 | 2.122 |
| −0.683 | −0.213 | 2.122 | −0.829 | 0.060 | 2.122 | | | |
| −0.773 | −0.194 | 2.122 | −0.745 | 0.051 | 2.122 | | | |
| 1.727 | −0.034 | 3.183 | −0.869 | −0.112 | 3.183 | −0.663 | 0.053 | 3.183 |
| 1.727 | −0.039 | 3.183 | −0.950 | −0.087 | 3.183 | −0.573 | 0.041 | 3.183 |
| 1.725 | −0.045 | 3.183 | −1.028 | −0.062 | 3.183 | −0.479 | 0.030 | 3.183 |
| 1.720 | −0.052 | 3.183 | −1.101 | −0.037 | 3.183 | −0.382 | 0.020 | 3.183 |
| 1.711 | −0.056 | 3.183 | −1.168 | −0.012 | 3.183 | −0.284 | 0.011 | 3.183 |
| 1.698 | −0.059 | 3.183 | −1.227 | 0.012 | 3.183 | −0.187 | 0.004 | 3.183 |
| 1.680 | −0.062 | 3.183 | −1.280 | 0.034 | 3.183 | −0.089 | −0.003 | 3.183 |
| 1.659 | −0.066 | 3.183 | −1.327 | 0.055 | 3.183 | 0.009 | −0.008 | 3.183 |
| 1.633 | −0.071 | 3.183 | −1.367 | 0.074 | 3.183 | 0.106 | −0.012 | 3.183 |
| 1.602 | −0.076 | 3.183 | −1.400 | 0.090 | 3.183 | 0.204 | −0.016 | 3.183 |
| 1.566 | −0.083 | 3.183 | −1.428 | 0.106 | 3.183 | 0.302 | −0.020 | 3.183 |
| 1.523 | −0.091 | 3.183 | −1.450 | 0.120 | 3.183 | 0.399 | −0.023 | 3.183 |
| 1.474 | −0.099 | 3.183 | −1.469 | 0.132 | 3.183 | 0.497 | −0.025 | 3.183 |
| 1.418 | −0.109 | 3.183 | −1.482 | 0.143 | 3.183 | 0.595 | −0.027 | 3.183 |
| 1.356 | −0.119 | 3.183 | −1.492 | 0.152 | 3.183 | 0.693 | −0.029 | 3.183 |
| 1.286 | −0.130 | 3.183 | −1.499 | 0.160 | 3.183 | 0.787 | −0.031 | 3.183 |
| 1.211 | −0.142 | 3.183 | −1.503 | 0.167 | 3.183 | 0.878 | −0.032 | 3.183 |
| 1.131 | −0.154 | 3.183 | −1.505 | 0.173 | 3.183 | 0.966 | −0.033 | 3.183 |
| 1.049 | −0.166 | 3.183 | −1.505 | 0.178 | 3.183 | 1.051 | −0.033 | 3.183 |
| 0.963 | −0.178 | 3.183 | −1.502 | 0.183 | 3.183 | 1.133 | −0.033 | 3.183 |
| 0.874 | −0.190 | 3.183 | −1.497 | 0.186 | 3.183 | 1.211 | −0.032 | 3.183 |
| 0.781 | −0.202 | 3.183 | −1.489 | 0.189 | 3.183 | 1.286 | −0.031 | 3.183 |
| 0.686 | −0.213 | 3.183 | −1.479 | 0.190 | 3.183 | 1.354 | −0.029 | 3.183 |
| 0.587 | −0.223 | 3.183 | −1.466 | 0.191 | 3.183 | 1.416 | −0.027 | 3.183 |
| 0.487 | −0.231 | 3.183 | −1.449 | 0.191 | 3.183 | 1.472 | −0.026 | 3.183 |
| 0.388 | −0.238 | 3.183 | −1.428 | 0.189 | 3.183 | 1.521 | −0.024 | 3.183 |
| 0.289 | −0.244 | 3.183 | −1.402 | 0.186 | 3.183 | 1.563 | −0.023 | 3.183 |
| 0.190 | −0.247 | 3.183 | −1.372 | 0.181 | 3.183 | 1.599 | −0.021 | 3.183 |
| 0.090 | −0.248 | 3.183 | −1.337 | 0.174 | 3.183 | 1.629 | −0.020 | 3.183 |
| −0.009 | −0.247 | 3.183 | −1.295 | 0.166 | 3.183 | 1.655 | −0.019 | 3.183 |
| −0.109 | −0.242 | 3.183 | −1.247 | 0.156 | 3.183 | 1.676 | −0.018 | 3.183 |
| −0.208 | −0.235 | 3.183 | −1.193 | 0.145 | 3.183 | 1.693 | −0.017 | 3.183 |
| −0.308 | −0.225 | 3.183 | −1.132 | 0.133 | 3.183 | 1.706 | −0.016 | 3.183 |
| −0.407 | −0.212 | 3.183 | −1.065 | 0.119 | 3.183 | 1.716 | −0.019 | 3.183 |
| −0.507 | −0.195 | 3.183 | −0.992 | 0.106 | 3.183 | 1.722 | −0.024 | 3.183 |
| −0.603 | −0.177 | 3.183 | −0.915 | 0.092 | 3.183 | 1.726 | −0.029 | 3.183 |
| −0.696 | −0.157 | 3.183 | −0.834 | 0.079 | 3.183 | | | |
| −0.785 | −0.135 | 3.183 | −0.750 | 0.065 | 3.183 | | | |
| 1.730 | −0.108 | 3.713 | −0.873 | −0.080 | 3.713 | −0.665 | 0.059 | 3.713 |
| 1.730 | −0.113 | 3.713 | −0.953 | −0.054 | 3.713 | −0.574 | 0.044 | 3.713 |
| 1.727 | −0.119 | 3.713 | −1.030 | −0.028 | 3.713 | −0.480 | 0.030 | 3.713 |
| 1.722 | −0.125 | 3.713 | −1.103 | −0.002 | 3.713 | −0.383 | 0.017 | 3.713 |
| 1.713 | −0.129 | 3.713 | −1.169 | 0.024 | 3.713 | −0.286 | 0.005 | 3.713 |
| 1.700 | −0.131 | 3.713 | −1.229 | 0.048 | 3.713 | −0.188 | −0.006 | 3.713 |
| 1.682 | −0.134 | 3.713 | −1.281 | 0.070 | 3.713 | −0.091 | −0.016 | 3.713 |
| 1.661 | −0.137 | 3.713 | −1.327 | 0.091 | 3.713 | 0.007 | −0.025 | 3.713 |
| 1.635 | −0.141 | 3.713 | −1.367 | 0.110 | 3.713 | 0.105 | −0.033 | 3.713 |
| 1.604 | −0.145 | 3.713 | −1.400 | 0.127 | 3.713 | 0.203 | −0.040 | 3.713 |
| 1.567 | −0.150 | 3.713 | −1.428 | 0.142 | 3.713 | 0.301 | −0.048 | 3.713 |
| 1.524 | −0.156 | 3.713 | −1.451 | 0.156 | 3.713 | 0.399 | −0.054 | 3.713 |
| 1.474 | −0.163 | 3.713 | −1.469 | 0.168 | 3.713 | 0.497 | −0.061 | 3.713 |
| 1.418 | −0.170 | 3.713 | −1.483 | 0.179 | 3.713 | 0.595 | −0.066 | 3.713 |
| 1.355 | −0.178 | 3.713 | −1.493 | 0.188 | 3.713 | 0.693 | −0.072 | 3.713 |
| 1.285 | −0.186 | 3.713 | −1.499 | 0.196 | 3.713 | 0.787 | −0.077 | 3.713 |
| 1.209 | −0.194 | 3.713 | −1.504 | 0.203 | 3.713 | 0.879 | −0.081 | 3.713 |
| 1.129 | −0.203 | 3.713 | −1.506 | 0.210 | 3.713 | 0.967 | −0.084 | 3.713 |
| 1.046 | −0.211 | 3.713 | −1.505 | 0.215 | 3.713 | 1.052 | −0.087 | 3.713 |
| 0.959 | −0.219 | 3.713 | −1.502 | 0.219 | 3.713 | 1.134 | −0.090 | 3.713 |
| 0.870 | −0.227 | 3.713 | −1.497 | 0.222 | 3.713 | 1.213 | −0.091 | 3.713 |

TABLE 6R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.777 | −0.234 | 3.713 | −1.489 | 0.224 | 3.713 | 1.288 | −0.092 | 3.713 |
| 0.680 | −0.240 | 3.713 | −1.479 | 0.226 | 3.713 | 1.357 | −0.093 | 3.713 |
| 0.581 | −0.245 | 3.713 | −1.466 | 0.226 | 3.713 | 1.419 | −0.093 | 3.713 |
| 0.481 | −0.249 | 3.713 | −1.449 | 0.225 | 3.713 | 1.474 | −0.093 | 3.713 |
| 0.382 | −0.251 | 3.713 | −1.428 | 0.222 | 3.713 | 1.524 | −0.092 | 3.713 |
| 0.282 | −0.251 | 3.713 | −1.402 | 0.218 | 3.713 | 1.566 | −0.092 | 3.713 |
| 0.182 | −0.250 | 3.713 | −1.372 | 0.211 | 3.713 | 1.602 | −0.091 | 3.713 |
| 0.083 | −0.246 | 3.713 | −1.337 | 0.203 | 3.713 | 1.633 | −0.091 | 3.713 |
| −0.017 | −0.240 | 3.713 | −1.295 | 0.193 | 3.713 | 1.659 | −0.090 | 3.713 |
| −0.116 | −0.231 | 3.713 | −1.248 | 0.182 | 3.713 | 1.680 | −0.090 | 3.713 |
| −0.215 | −0.220 | 3.713 | −1.194 | 0.169 | 3.713 | 1.697 | −0.090 | 3.713 |
| −0.315 | −0.207 | 3.713 | −1.133 | 0.154 | 3.713 | 1.710 | −0.089 | 3.713 |
| −0.414 | −0.190 | 3.713 | −1.066 | 0.139 | 3.713 | 1.719 | −0.092 | 3.713 |
| −0.513 | −0.171 | 3.713 | −0.993 | 0.122 | 3.713 | 1.726 | −0.097 | 3.713 |
| −0.609 | −0.151 | 3.713 | −0.916 | 0.106 | 3.713 | 1.729 | −0.103 | 3.713 |
| −0.701 | −0.128 | 3.713 | −0.835 | 0.090 | 3.713 | | | |
| −0.789 | −0.105 | 3.713 | −0.752 | 0.074 | 3.713 | | | |
| 1.731 | −0.178 | 4.244 | −0.874 | −0.048 | 4.244 | −0.666 | 0.067 | 4.244 |
| 1.731 | −0.183 | 4.244 | −0.954 | −0.021 | 4.244 | −0.576 | 0.049 | 4.244 |
| 1.729 | −0.189 | 4.244 | −1.030 | 0.006 | 4.244 | −0.482 | 0.031 | 4.244 |
| 1.723 | −0.195 | 4.244 | −1.103 | 0.034 | 4.244 | −0.385 | 0.014 | 4.244 |
| 1.714 | −0.199 | 4.244 | −1.169 | 0.060 | 4.244 | −0.288 | −0.001 | 4.244 |
| 1.700 | −0.200 | 4.244 | −1.228 | 0.085 | 4.244 | −0.191 | −0.015 | 4.244 |
| 1.683 | −0.202 | 4.244 | −1.280 | 0.108 | 4.244 | −0.093 | −0.029 | 4.244 |
| 1.661 | −0.204 | 4.244 | −1.326 | 0.130 | 4.244 | 0.005 | −0.041 | 4.244 |
| 1.635 | −0.207 | 4.244 | −1.366 | 0.149 | 4.244 | 0.103 | −0.053 | 4.244 |
| 1.604 | −0.210 | 4.244 | −1.399 | 0.166 | 4.244 | 0.201 | −0.064 | 4.244 |
| 1.567 | −0.214 | 4.244 | −1.427 | 0.181 | 4.244 | 0.299 | −0.074 | 4.244 |
| 1.524 | −0.218 | 4.244 | −1.449 | 0.195 | 4.244 | 0.397 | −0.085 | 4.244 |
| 1.474 | −0.223 | 4.244 | −1.467 | 0.207 | 4.244 | 0.495 | −0.094 | 4.244 |
| 1.417 | −0.228 | 4.244 | −1.481 | 0.218 | 4.244 | 0.593 | −0.103 | 4.244 |
| 1.353 | −0.233 | 4.244 | −1.491 | 0.227 | 4.244 | 0.691 | −0.112 | 4.244 |
| 1.283 | −0.238 | 4.244 | −1.498 | 0.235 | 4.244 | 0.786 | −0.120 | 4.244 |
| 1.206 | −0.244 | 4.244 | −1.502 | 0.242 | 4.244 | 0.878 | −0.127 | 4.244 |
| 1.126 | −0.249 | 4.244 | −1.504 | 0.249 | 4.244 | 0.966 | −0.133 | 4.244 |
| 1.043 | −0.254 | 4.244 | −1.503 | 0.254 | 4.244 | 1.052 | −0.139 | 4.244 |
| 0.956 | −0.258 | 4.244 | −1.500 | 0.258 | 4.244 | 1.134 | −0.144 | 4.244 |
| 0.866 | −0.262 | 4.244 | −1.494 | 0.261 | 4.244 | 1.212 | −0.148 | 4.244 |
| 0.772 | −0.264 | 4.244 | −1.486 | 0.263 | 4.244 | 1.288 | −0.151 | 4.244 |
| 0.675 | −0.266 | 4.244 | −1.476 | 0.264 | 4.244 | 1.357 | −0.153 | 4.244 |
| 0.576 | −0.266 | 4.244 | −1.463 | 0.263 | 4.244 | 1.419 | −0.155 | 4.244 |
| 0.476 | −0.265 | 4.244 | −1.446 | 0.261 | 4.244 | 1.475 | −0.156 | 4.244 |
| 0.376 | −0.263 | 4.244 | −1.425 | 0.258 | 4.244 | 1.524 | −0.157 | 4.244 |
| 0.276 | −0.259 | 4.244 | −1.400 | 0.253 | 4.244 | 1.567 | −0.158 | 4.244 |
| 0.177 | −0.253 | 4.244 | −1.370 | 0.245 | 4.244 | 1.603 | −0.158 | 4.244 |
| 0.077 | −0.245 | 4.244 | −1.335 | 0.236 | 4.244 | 1.634 | −0.159 | 4.244 |
| −0.022 | −0.234 | 4.244 | −1.294 | 0.224 | 4.244 | 1.660 | −0.159 | 4.244 |
| −0.122 | −0.222 | 4.244 | −1.246 | 0.210 | 4.244 | 1.681 | −0.159 | 4.244 |
| −0.221 | −0.207 | 4.244 | −1.193 | 0.195 | 4.244 | 1.699 | −0.159 | 4.244 |
| −0.320 | −0.190 | 4.244 | −1.132 | 0.179 | 4.244 | 1.712 | −0.159 | 4.244 |
| −0.419 | −0.171 | 4.244 | −1.066 | 0.161 | 4.244 | 1.721 | −0.162 | 4.244 |
| −0.517 | −0.149 | 4.244 | −0.993 | 0.142 | 4.244 | 1.727 | −0.167 | 4.244 |
| −0.612 | −0.125 | 4.244 | −0.916 | 0.123 | 4.244 | 1.731 | −0.173 | 4.244 |
| −0.703 | −0.101 | 4.244 | −0.836 | 0.104 | 4.244 | | | |
| −0.791 | −0.075 | 4.244 | −0.753 | 0.085 | 4.244 | | | |
| 1.733 | −0.304 | 5.304 | −0.872 | 0.004 | 5.304 | −0.665 | 0.082 | 5.304 |
| 1.732 | −0.309 | 5.304 | −0.951 | 0.034 | 5.304 | −0.575 | 0.059 | 5.304 |
| 1.729 | −0.315 | 5.304 | −1.027 | 0.063 | 5.304 | −0.482 | 0.036 | 5.304 |
| 1.723 | −0.321 | 5.304 | −1.098 | 0.093 | 5.304 | −0.385 | 0.013 | 5.304 |
| 1.713 | −0.323 | 5.304 | −1.163 | 0.121 | 5.304 | −0.288 | −0.009 | 5.304 |
| 1.700 | −0.324 | 5.304 | −1.222 | 0.147 | 5.304 | −0.191 | −0.029 | 5.304 |
| 1.682 | −0.324 | 5.304 | −1.274 | 0.172 | 5.304 | −0.094 | −0.048 | 5.304 |
| 1.661 | −0.325 | 5.304 | −1.320 | 0.194 | 5.304 | 0.004 | −0.067 | 5.304 |
| 1.634 | −0.326 | 5.304 | −1.359 | 0.213 | 5.304 | 0.102 | −0.084 | 5.304 |
| 1.602 | −0.326 | 5.304 | −1.392 | 0.230 | 5.304 | 0.200 | −0.101 | 5.304 |
| 1.566 | −0.327 | 5.304 | −1.420 | 0.245 | 5.304 | 0.298 | −0.117 | 5.304 |
| 1.522 | −0.328 | 5.304 | −1.442 | 0.259 | 5.304 | 0.396 | −0.133 | 5.304 |
| 1.471 | −0.329 | 5.304 | −1.460 | 0.272 | 5.304 | 0.494 | −0.148 | 5.304 |
| 1.414 | −0.329 | 5.304 | −1.474 | 0.283 | 5.304 | 0.592 | −0.163 | 5.304 |
| 1.350 | −0.329 | 5.304 | −1.484 | 0.292 | 5.304 | 0.690 | −0.178 | 5.304 |
| 1.280 | −0.329 | 5.304 | −1.490 | 0.300 | 5.304 | 0.785 | −0.191 | 5.304 |
| 1.203 | −0.329 | 5.304 | −1.495 | 0.307 | 5.304 | 0.877 | −0.203 | 5.304 |
| 1.122 | −0.327 | 5.304 | −1.497 | 0.313 | 5.304 | 0.966 | −0.215 | 5.304 |
| 1.038 | −0.326 | 5.304 | −1.496 | 0.318 | 5.304 | 1.051 | −0.225 | 5.304 |
| 0.951 | −0.323 | 5.304 | −1.493 | 0.322 | 5.304 | 1.133 | −0.235 | 5.304 |
| 0.860 | −0.320 | 5.304 | −1.487 | 0.325 | 5.304 | 1.212 | −0.243 | 5.304 |
| 0.767 | −0.315 | 5.304 | −1.478 | 0.326 | 5.304 | 1.288 | −0.251 | 5.304 |

TABLE 6R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.670 | −0.309 | 5.304 | −1.468 | 0.327 | 5.304 | 1.357 | −0.258 | 5.304 |
| 0.569 | −0.302 | 5.304 | −1.455 | 0.326 | 5.304 | 1.420 | −0.263 | 5.304 |
| 0.469 | −0.293 | 5.304 | −1.438 | 0.323 | 5.304 | 1.476 | −0.268 | 5.304 |
| 0.370 | −0.283 | 5.304 | −1.417 | 0.318 | 5.304 | 1.526 | −0.271 | 5.304 |
| 0.270 | −0.272 | 5.304 | −1.392 | 0.311 | 5.304 | 1.569 | −0.275 | 5.304 |
| 0.170 | −0.258 | 5.304 | −1.362 | 0.302 | 5.304 | 1.605 | −0.277 | 5.304 |
| 0.071 | −0.243 | 5.304 | −1.328 | 0.290 | 5.304 | 1.636 | −0.279 | 5.304 |
| −0.028 | −0.226 | 5.304 | −1.287 | 0.276 | 5.304 | 1.662 | −0.281 | 5.304 |
| −0.127 | −0.207 | 5.304 | −1.240 | 0.259 | 5.304 | 1.684 | −0.282 | 5.304 |
| −0.226 | −0.186 | 5.304 | −1.187 | 0.241 | 5.304 | 1.701 | −0.283 | 5.304 |
| −0.324 | −0.163 | 5.304 | −1.127 | 0.221 | 5.304 | 1.714 | −0.284 | 5.304 |
| −0.422 | −0.138 | 5.304 | −1.061 | 0.200 | 5.304 | 1.724 | −0.287 | 5.304 |
| −0.520 | −0.111 | 5.304 | −0.989 | 0.177 | 5.304 | 1.730 | −0.293 | 5.304 |
| −0.614 | −0.084 | 5.304 | −0.913 | 0.153 | 5.304 | 1.732 | −0.299 | 5.304 |
| −0.704 | −0.055 | 5.304 | −0.833 | 0.130 | 5.304 | | | |
| −0.790 | −0.026 | 5.304 | −0.751 | 0.106 | 5.304 | | | |
| 1.728 | −0.416 | 6.365 | −0.869 | 0.045 | 6.365 | −0.661 | 0.102 | 6.365 |
| 1.727 | −0.421 | 6.365 | −0.947 | 0.077 | 6.365 | −0.572 | 0.074 | 6.365 |
| 1.724 | −0.427 | 6.365 | −1.022 | 0.109 | 6.365 | −0.479 | 0.047 | 6.365 |
| 1.717 | −0.432 | 6.365 | −1.093 | 0.141 | 6.365 | −0.383 | 0.020 | 6.365 |
| 1.707 | −0.434 | 6.365 | −1.157 | 0.171 | 6.365 | −0.287 | −0.006 | 6.365 |
| 1.694 | −0.433 | 6.365 | −1.215 | 0.198 | 6.365 | −0.190 | −0.031 | 6.365 |
| 1.676 | −0.433 | 6.365 | −1.267 | 0.224 | 6.365 | −0.093 | −0.055 | 6.365 |
| 1.654 | −0.432 | 6.365 | −1.312 | 0.246 | 6.365 | 0.004 | −0.079 | 6.365 |
| 1.628 | −0.430 | 6.365 | −1.351 | 0.266 | 6.365 | 0.101 | −0.101 | 6.365 |
| 1.596 | −0.429 | 6.365 | −1.384 | 0.284 | 6.365 | 0.199 | −0.123 | 6.365 |
| 1.559 | −0.427 | 6.365 | −1.412 | 0.300 | 6.365 | 0.297 | −0.144 | 6.365 |
| 1.515 | −0.424 | 6.365 | −1.435 | 0.314 | 6.365 | 0.394 | −0.165 | 6.365 |
| 1.465 | −0.421 | 6.365 | −1.453 | 0.326 | 6.365 | 0.492 | −0.186 | 6.365 |
| 1.407 | −0.418 | 6.365 | −1.466 | 0.337 | 6.365 | 0.590 | −0.206 | 6.365 |
| 1.344 | −0.413 | 6.365 | −1.476 | 0.346 | 6.365 | 0.688 | −0.226 | 6.365 |
| 1.273 | −0.408 | 6.365 | −1.483 | 0.354 | 6.365 | 0.783 | −0.244 | 6.365 |
| 1.196 | −0.402 | 6.365 | −1.487 | 0.361 | 6.365 | 0.875 | −0.262 | 6.365 |
| 1.115 | −0.395 | 6.365 | −1.489 | 0.368 | 6.365 | 0.963 | −0.279 | 6.365 |
| 1.031 | −0.387 | 6.365 | −1.489 | 0.373 | 6.365 | 1.048 | −0.294 | 6.365 |
| 0.944 | −0.379 | 6.365 | −1.485 | 0.376 | 6.365 | 1.130 | −0.309 | 6.365 |
| 0.853 | −0.369 | 6.365 | −1.479 | 0.379 | 6.365 | 1.209 | −0.322 | 6.365 |
| 0.760 | −0.358 | 6.365 | −1.471 | 0.379 | 6.365 | 1.285 | −0.335 | 6.365 |
| 0.663 | −0.346 | 6.365 | −1.461 | 0.379 | 6.365 | 1.354 | −0.345 | 6.365 |
| 0.563 | −0.332 | 6.365 | −1.447 | 0.377 | 6.365 | 1.417 | −0.355 | 6.365 |
| 0.463 | −0.317 | 6.365 | −1.430 | 0.374 | 6.365 | 1.473 | −0.363 | 6.365 |
| 0.364 | −0.301 | 6.365 | −1.410 | 0.368 | 6.365 | 1.522 | −0.370 | 6.365 |
| 0.264 | −0.283 | 6.365 | −1.385 | 0.359 | 6.365 | 1.565 | −0.376 | 6.365 |
| 0.165 | −0.264 | 6.365 | −1.355 | 0.349 | 6.365 | 1.602 | −0.381 | 6.365 |
| 0.067 | −0.243 | 6.365 | −1.321 | 0.335 | 6.365 | 1.633 | −0.385 | 6.365 |
| −0.032 | −0.221 | 6.365 | −1.280 | 0.320 | 6.365 | 1.659 | −0.389 | 6.365 |
| −0.130 | −0.197 | 6.365 | −1.234 | 0.302 | 6.365 | 1.680 | −0.391 | 6.365 |
| −0.228 | −0.171 | 6.365 | −1.181 | 0.282 | 6.365 | 1.697 | −0.393 | 6.365 |
| −0.326 | −0.143 | 6.365 | −1.121 | 0.259 | 6.365 | 1.711 | −0.395 | 6.365 |
| −0.423 | −0.114 | 6.365 | −1.055 | 0.235 | 6.365 | 1.720 | −0.399 | 6.365 |
| −0.520 | −0.083 | 6.365 | −0.983 | 0.209 | 6.365 | 1.726 | −0.405 | 6.365 |
| −0.612 | −0.051 | 6.365 | −0.908 | 0.183 | 6.365 | 1.728 | −0.411 | 6.365 |
| −0.701 | −0.019 | 6.365 | −0.829 | 0.156 | 6.365 | | | |
| −0.787 | 0.013 | 6.365 | −0.747 | 0.129 | 6.365 | | | |
| 1.712 | −0.529 | 7.426 | −0.868 | 0.097 | 7.426 | −0.660 | 0.133 | 7.426 |
| 1.710 | −0.534 | 7.426 | −0.945 | 0.134 | 7.426 | −0.572 | 0.101 | 7.426 |
| 1.706 | −0.539 | 7.426 | −1.018 | 0.170 | 7.426 | −0.480 | 0.068 | 7.426 |
| 1.699 | −0.544 | 7.426 | −1.088 | 0.205 | 7.426 | −0.385 | 0.036 | 7.426 |
| 1.689 | −0.545 | 7.426 | −1.151 | 0.239 | 7.426 | −0.289 | 0.004 | 7.426 |
| 1.676 | −0.543 | 7.426 | −1.208 | 0.270 | 7.426 | −0.193 | −0.026 | 7.426 |
| 1.658 | −0.541 | 7.426 | −1.258 | 0.298 | 7.426 | −0.097 | −0.055 | 7.426 |
| 1.636 | −0.538 | 7.426 | −1.302 | 0.324 | 7.426 | −0.001 | −0.084 | 7.426 |
| 1.610 | −0.535 | 7.426 | −1.340 | 0.346 | 7.426 | 0.096 | −0.112 | 7.426 |
| 1.578 | −0.531 | 7.426 | −1.372 | 0.366 | 7.426 | 0.193 | −0.140 | 7.426 |
| 1.541 | −0.526 | 7.426 | −1.399 | 0.383 | 7.426 | 0.290 | −0.166 | 7.426 |
| 1.497 | −0.521 | 7.426 | −1.421 | 0.398 | 7.426 | 0.387 | −0.193 | 7.426 |
| 1.447 | −0.514 | 7.426 | −1.439 | 0.411 | 7.426 | 0.484 | −0.219 | 7.426 |
| 1.390 | −0.506 | 7.426 | −1.453 | 0.422 | 7.426 | 0.582 | −0.245 | 7.426 |
| 1.326 | −0.498 | 7.426 | −1.462 | 0.432 | 7.426 | 0.679 | −0.271 | 7.426 |
| 1.255 | −0.488 | 7.426 | −1.469 | 0.440 | 7.426 | 0.773 | −0.295 | 7.426 |
| 1.178 | −0.477 | 7.426 | −1.473 | 0.447 | 7.426 | 0.864 | −0.318 | 7.426 |
| 1.098 | −0.464 | 7.426 | −1.475 | 0.453 | 7.426 | 0.952 | −0.340 | 7.426 |
| 1.014 | −0.451 | 7.426 | −1.475 | 0.458 | 7.426 | 1.037 | −0.361 | 7.426 |
| 0.927 | −0.437 | 7.426 | −1.471 | 0.461 | 7.426 | 1.119 | −0.381 | 7.426 |
| 0.837 | −0.421 | 7.426 | −1.464 | 0.463 | 7.426 | 1.197 | −0.399 | 7.426 |
| 0.744 | −0.404 | 7.426 | −1.456 | 0.463 | 7.426 | 1.272 | −0.416 | 7.426 |
| 0.647 | −0.386 | 7.426 | −1.446 | 0.462 | 7.426 | 1.341 | −0.432 | 7.426 |

TABLE 6R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.548 | −0.366 | 7.426 | −1.433 | 0.459 | 7.426 | 1.403 | −0.446 | 7.426 |
| 0.448 | −0.344 | 7.426 | −1.416 | 0.453 | 7.426 | 1.459 | −0.458 | 7.426 |
| 0.350 | −0.322 | 7.426 | −1.396 | 0.446 | 7.426 | 1.508 | −0.468 | 7.426 |
| 0.251 | −0.298 | 7.426 | −1.371 | 0.435 | 7.426 | 1.551 | −0.477 | 7.426 |
| 0.152 | −0.272 | 7.426 | −1.343 | 0.422 | 7.426 | 1.587 | −0.485 | 7.426 |
| 0.054 | −0.245 | 7.426 | −1.309 | 0.407 | 7.426 | 1.618 | −0.491 | 7.426 |
| −0.043 | −0.217 | 7.426 | −1.269 | 0.388 | 7.426 | 1.644 | −0.496 | 7.426 |
| −0.141 | −0.187 | 7.426 | −1.224 | 0.367 | 7.426 | 1.666 | −0.501 | 7.426 |
| −0.238 | −0.155 | 7.426 | −1.172 | 0.344 | 7.426 | 1.683 | −0.504 | 7.426 |
| −0.334 | −0.122 | 7.426 | −1.113 | 0.318 | 7.426 | 1.696 | −0.506 | 7.426 |
| −0.430 | −0.087 | 7.426 | −1.049 | 0.290 | 7.426 | 1.705 | −0.511 | 7.426 |
| −0.525 | −0.050 | 7.426 | −0.978 | 0.259 | 7.426 | 1.710 | −0.517 | 7.426 |
| −0.616 | −0.014 | 7.426 | −0.903 | 0.228 | 7.426 | 1.712 | −0.524 | 7.426 |
| −0.704 | 0.023 | 7.426 | −0.826 | 0.197 | 7.426 | | | |
| −0.788 | 0.060 | 7.426 | −0.744 | 0.165 | 7.426 | | | |
| 1.646 | −0.670 | 8.487 | −0.879 | 0.236 | 8.487 | −0.678 | 0.222 | 8.487 |
| 1.644 | −0.675 | 8.487 | −0.949 | 0.288 | 8.487 | −0.596 | 0.174 | 8.487 |
| 1.640 | −0.680 | 8.487 | −1.015 | 0.338 | 8.487 | −0.510 | 0.127 | 8.487 |
| 1.632 | −0.684 | 8.487 | −1.078 | 0.388 | 8.487 | −0.420 | 0.079 | 8.487 |
| 1.622 | −0.685 | 8.487 | −1.134 | 0.435 | 8.487 | −0.328 | 0.033 | 8.487 |
| 1.608 | −0.682 | 8.487 | −1.185 | 0.477 | 8.487 | −0.236 | −0.011 | 8.487 |
| 1.591 | −0.679 | 8.487 | −1.229 | 0.516 | 8.487 | −0.143 | −0.053 | 8.487 |
| 1.569 | −0.675 | 8.487 | −1.268 | 0.550 | 8.487 | −0.050 | −0.093 | 8.487 |
| 1.542 | −0.670 | 8.487 | −1.301 | 0.581 | 8.487 | 0.045 | −0.132 | 8.487 |
| 1.510 | −0.664 | 8.487 | −1.329 | 0.607 | 8.487 | 0.139 | −0.169 | 8.487 |
| 1.473 | −0.657 | 8.487 | −1.353 | 0.630 | 8.487 | 0.235 | −0.205 | 8.487 |
| 1.429 | −0.649 | 8.487 | −1.372 | 0.649 | 8.487 | 0.331 | −0.239 | 8.487 |
| 1.378 | −0.639 | 8.487 | −1.387 | 0.666 | 8.487 | 0.427 | −0.273 | 8.487 |
| 1.320 | −0.628 | 8.487 | −1.399 | 0.680 | 8.487 | 0.523 | −0.306 | 8.487 |
| 1.256 | −0.615 | 8.487 | −1.407 | 0.691 | 8.487 | 0.620 | −0.339 | 8.487 |
| 1.185 | −0.600 | 8.487 | −1.412 | 0.700 | 8.487 | 0.713 | −0.370 | 8.487 |
| 1.107 | −0.584 | 8.487 | −1.416 | 0.708 | 8.487 | 0.804 | −0.399 | 8.487 |
| 1.026 | −0.566 | 8.487 | −1.417 | 0.715 | 8.487 | 0.891 | −0.427 | 8.487 |
| 0.942 | −0.548 | 8.487 | −1.415 | 0.720 | 8.487 | 0.975 | −0.454 | 8.487 |
| 0.855 | −0.527 | 8.487 | −1.411 | 0.722 | 8.487 | 1.056 | −0.480 | 8.487 |
| 0.765 | −0.505 | 8.487 | −1.404 | 0.721 | 8.487 | 1.134 | −0.504 | 8.487 |
| 0.672 | −0.481 | 8.487 | −1.396 | 0.718 | 8.487 | 1.209 | −0.527 | 8.487 |
| 0.576 | −0.455 | 8.487 | −1.387 | 0.714 | 8.487 | 1.277 | −0.548 | 8.487 |
| 0.477 | −0.427 | 8.487 | −1.375 | 0.707 | 8.487 | 1.339 | −0.566 | 8.487 |
| 0.379 | −0.397 | 8.487 | −1.360 | 0.698 | 8.487 | 1.395 | −0.582 | 8.487 |
| 0.281 | −0.365 | 8.487 | −1.342 | 0.685 | 8.487 | 1.444 | −0.596 | 8.487 |
| 0.184 | −0.331 | 8.487 | −1.321 | 0.668 | 8.487 | 1.487 | −0.608 | 8.487 |
| 0.088 | −0.295 | 8.487 | −1.296 | 0.648 | 8.487 | 1.523 | −0.618 | 8.487 |
| −0.007 | −0.256 | 8.487 | −1.266 | 0.625 | 8.487 | 1.553 | −0.626 | 8.487 |
| −0.102 | −0.215 | 8.487 | −1.231 | 0.598 | 8.487 | 1.579 | −0.633 | 8.487 |
| −0.195 | −0.172 | 8.487 | −1.190 | 0.568 | 8.487 | 1.601 | −0.639 | 8.487 |
| −0.288 | −0.126 | 8.487 | −1.144 | 0.533 | 8.487 | 1.618 | −0.643 | 8.487 |
| −0.380 | −0.078 | 8.487 | −1.092 | 0.495 | 8.487 | 1.631 | −0.647 | 8.487 |
| −0.471 | −0.028 | 8.487 | −1.034 | 0.453 | 8.487 | 1.640 | −0.651 | 8.487 |
| −0.561 | 0.025 | 8.487 | −0.970 | 0.409 | 8.487 | 1.645 | −0.658 | 8.487 |
| −0.647 | 0.078 | 8.487 | −0.902 | 0.363 | 8.487 | 1.646 | −0.665 | 8.487 |
| −0.728 | 0.131 | 8.487 | −0.831 | 0.317 | 8.487 | | | |
| −0.806 | 0.184 | 8.487 | −0.756 | 0.270 | 8.487 | | | |

The coordinate values given in TABLE 7R below provide the nominal profile envelope for an exemplary seventh stage rotor.

TABLE 7R

| X-LOC | Y-LOC | Z-LOC | X-LOC | Y-LOC | Z-LOC | X-LOC | Y-LOC | Z-LOC |
|---|---|---|---|---|---|---|---|---|
| 1.784 | 0.166 | 0.000 | −0.838 | −0.106 | 0.000 | −0.598 | 0.119 | 0.000 |
| 1.784 | 0.161 | 0.000 | −0.918 | −0.078 | 0.000 | −0.507 | 0.110 | 0.000 |
| 1.783 | 0.155 | 0.000 | −0.994 | −0.048 | 0.000 | −0.414 | 0.103 | 0.000 |
| 1.779 | 0.147 | 0.000 | −1.066 | −0.017 | 0.000 | −0.316 | 0.097 | 0.000 |
| 1.770 | 0.141 | 0.000 | −1.130 | 0.014 | 0.000 | −0.219 | 0.092 | 0.000 |
| 1.757 | 0.138 | 0.000 | −1.187 | 0.044 | 0.000 | −0.121 | 0.089 | 0.000 |
| 1.740 | 0.133 | 0.000 | −1.237 | 0.072 | 0.000 | −0.024 | 0.088 | 0.000 |
| 1.719 | 0.127 | 0.000 | −1.281 | 0.099 | 0.000 | 0.074 | 0.088 | 0.000 |
| 1.693 | 0.121 | 0.000 | −1.318 | 0.124 | 0.000 | 0.171 | 0.089 | 0.000 |
| 1.662 | 0.113 | 0.000 | −1.348 | 0.145 | 0.000 | 0.269 | 0.091 | 0.000 |
| 1.626 | 0.103 | 0.000 | −1.374 | 0.165 | 0.000 | 0.366 | 0.094 | 0.000 |

TABLE 7R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.583 | 0.092 | 0.000 | −1.395 | 0.183 | 0.000 | 0.463 | 0.097 | 0.000 |
| 1.533 | 0.079 | 0.000 | −1.411 | 0.199 | 0.000 | 0.561 | 0.102 | 0.000 |
| 1.477 | 0.065 | 0.000 | −1.422 | 0.213 | 0.000 | 0.658 | 0.106 | 0.000 |
| 1.415 | 0.048 | 0.000 | −1.430 | 0.225 | 0.000 | 0.756 | 0.112 | 0.000 |
| 1.345 | 0.031 | 0.000 | −1.434 | 0.235 | 0.000 | 0.850 | 0.117 | 0.000 |
| 1.269 | 0.012 | 0.000 | −1.435 | 0.243 | 0.000 | 0.941 | 0.122 | 0.000 |
| 1.190 | −0.008 | 0.000 | −1.435 | 0.250 | 0.000 | 1.028 | 0.127 | 0.000 |
| 1.108 | −0.029 | 0.000 | −1.433 | 0.255 | 0.000 | 1.113 | 0.133 | 0.000 |
| 1.022 | −0.050 | 0.000 | −1.430 | 0.259 | 0.000 | 1.194 | 0.138 | 0.000 |
| 0.932 | −0.071 | 0.000 | −1.425 | 0.263 | 0.000 | 1.271 | 0.144 | 0.000 |
| 0.839 | −0.092 | 0.000 | −1.418 | 0.267 | 0.000 | 1.346 | 0.150 | 0.000 |
| 0.743 | −0.114 | 0.000 | −1.408 | 0.269 | 0.000 | 1.414 | 0.155 | 0.000 |
| 0.643 | −0.135 | 0.000 | −1.395 | 0.270 | 0.000 | 1.476 | 0.160 | 0.000 |
| 0.543 | −0.154 | 0.000 | −1.378 | 0.269 | 0.000 | 1.531 | 0.165 | 0.000 |
| 0.443 | −0.171 | 0.000 | −1.357 | 0.266 | 0.000 | 1.579 | 0.169 | 0.000 |
| 0.342 | −0.187 | 0.000 | −1.332 | 0.261 | 0.000 | 1.621 | 0.173 | 0.000 |
| 0.241 | −0.199 | 0.000 | −1.302 | 0.254 | 0.000 | 1.657 | 0.176 | 0.000 |
| 0.140 | −0.209 | 0.000 | −1.268 | 0.245 | 0.000 | 1.687 | 0.179 | 0.000 |
| 0.038 | −0.216 | 0.000 | −1.227 | 0.235 | 0.000 | 1.713 | 0.181 | 0.000 |
| −0.065 | −0.219 | 0.000 | −1.179 | 0.223 | 0.000 | 1.734 | 0.183 | 0.000 |
| −0.168 | −0.219 | 0.000 | −1.125 | 0.210 | 0.000 | 1.751 | 0.184 | 0.000 |
| −0.270 | −0.214 | 0.000 | −1.065 | 0.196 | 0.000 | 1.764 | 0.185 | 0.000 |
| −0.372 | −0.206 | 0.000 | −0.998 | 0.182 | 0.000 | 1.773 | 0.182 | 0.000 |
| −0.473 | −0.192 | 0.000 | −0.925 | 0.168 | 0.000 | 1.779 | 0.177 | 0.000 |
| −0.570 | −0.175 | 0.000 | −0.848 | 0.154 | 0.000 | 1.783 | 0.171 | 0.000 |
| −0.663 | −0.155 | 0.000 | −0.768 | 0.141 | 0.000 | | | |
| −0.753 | −0.131 | 0.000 | −0.685 | 0.130 | 0.000 | | | |
| 1.687 | 0.184 | 0.970 | −0.872 | −0.043 | 0.970 | −0.658 | 0.148 | 0.970 |
| 1.688 | 0.179 | 0.970 | −0.951 | −0.019 | 0.970 | −0.569 | 0.139 | 0.970 |
| 1.686 | 0.172 | 0.970 | −1.027 | 0.006 | 0.970 | −0.476 | 0.132 | 0.970 |
| 1.682 | 0.166 | 0.970 | −1.100 | 0.032 | 0.970 | −0.380 | 0.126 | 0.970 |
| 1.674 | 0.160 | 0.970 | −1.165 | 0.058 | 0.970 | −0.284 | 0.121 | 0.970 |
| 1.661 | 0.157 | 0.970 | −1.223 | 0.083 | 0.970 | −0.188 | 0.118 | 0.970 |
| 1.644 | 0.153 | 0.970 | −1.274 | 0.107 | 0.970 | −0.093 | 0.116 | 0.970 |
| 1.623 | 0.148 | 0.970 | −1.319 | 0.129 | 0.970 | 0.003 | 0.115 | 0.970 |
| 1.598 | 0.143 | 0.970 | −1.358 | 0.150 | 0.970 | 0.099 | 0.115 | 0.970 |
| 1.567 | 0.136 | 0.970 | −1.390 | 0.167 | 0.970 | 0.195 | 0.117 | 0.970 |
| 1.532 | 0.128 | 0.970 | −1.417 | 0.184 | 0.970 | 0.291 | 0.119 | 0.970 |
| 1.490 | 0.119 | 0.970 | −1.438 | 0.198 | 0.970 | 0.387 | 0.123 | 0.970 |
| 1.442 | 0.108 | 0.970 | −1.456 | 0.211 | 0.970 | 0.483 | 0.127 | 0.970 |
| 1.387 | 0.096 | 0.970 | −1.468 | 0.223 | 0.970 | 0.579 | 0.131 | 0.970 |
| 1.326 | 0.083 | 0.970 | −1.477 | 0.234 | 0.970 | 0.675 | 0.136 | 0.970 |
| 1.258 | 0.069 | 0.970 | −1.482 | 0.242 | 0.970 | 0.767 | 0.141 | 0.970 |
| 1.183 | 0.053 | 0.970 | −1.485 | 0.250 | 0.970 | 0.857 | 0.146 | 0.970 |
| 1.106 | 0.037 | 0.970 | −1.485 | 0.257 | 0.970 | 0.943 | 0.151 | 0.970 |
| 1.025 | 0.020 | 0.970 | −1.484 | 0.262 | 0.970 | 1.026 | 0.156 | 0.970 |
| 0.941 | 0.002 | 0.970 | −1.482 | 0.266 | 0.970 | 1.106 | 0.161 | 0.970 |
| 0.854 | −0.015 | 0.970 | −1.477 | 0.270 | 0.970 | 1.183 | 0.166 | 0.970 |
| 0.763 | −0.033 | 0.970 | −1.469 | 0.273 | 0.970 | 1.256 | 0.171 | 0.970 |
| 0.669 | −0.051 | 0.970 | −1.460 | 0.276 | 0.970 | 1.323 | 0.176 | 0.970 |
| 0.572 | −0.069 | 0.970 | −1.447 | 0.277 | 0.970 | 1.384 | 0.181 | 0.970 |
| 0.475 | −0.085 | 0.970 | −1.431 | 0.277 | 0.970 | 1.438 | 0.185 | 0.970 |
| 0.377 | −0.100 | 0.970 | −1.410 | 0.275 | 0.970 | 1.486 | 0.188 | 0.970 |
| 0.279 | −0.113 | 0.970 | −1.385 | 0.271 | 0.970 | 1.527 | 0.192 | 0.970 |
| 0.181 | −0.124 | 0.970 | −1.355 | 0.265 | 0.970 | 1.562 | 0.194 | 0.970 |
| 0.083 | −0.132 | 0.970 | −1.321 | 0.258 | 0.970 | 1.592 | 0.197 | 0.970 |
| −0.016 | −0.138 | 0.970 | −1.280 | 0.250 | 0.970 | 1.618 | 0.199 | 0.970 |
| −0.115 | −0.140 | 0.970 | −1.233 | 0.240 | 0.970 | 1.638 | 0.201 | 0.970 |
| −0.214 | −0.139 | 0.970 | −1.179 | 0.230 | 0.970 | 1.655 | 0.202 | 0.970 |
| −0.314 | −0.136 | 0.970 | −1.120 | 0.218 | 0.970 | 1.668 | 0.203 | 0.970 |
| −0.414 | −0.128 | 0.970 | −1.054 | 0.206 | 0.970 | 1.677 | 0.200 | 0.970 |
| −0.513 | −0.117 | 0.970 | −0.981 | 0.193 | 0.970 | 1.683 | 0.194 | 0.970 |
| −0.608 | −0.102 | 0.970 | −0.905 | 0.181 | 0.970 | 1.686 | 0.189 | 0.970 |
| −0.700 | −0.085 | 0.970 | −0.826 | 0.169 | 0.970 | | | |
| −0.788 | −0.065 | 0.970 | −0.744 | 0.158 | 0.970 | | | |
| 1.625 | 0.118 | 1.941 | −0.897 | 0.002 | 1.941 | −0.693 | 0.161 | 1.941 |
| 1.625 | 0.113 | 1.941 | −0.976 | 0.025 | 1.941 | −0.605 | 0.149 | 1.941 |
| 1.624 | 0.107 | 1.941 | −1.050 | 0.050 | 1.941 | −0.514 | 0.139 | 1.941 |
| 1.619 | 0.100 | 1.941 | −1.122 | 0.075 | 1.941 | −0.419 | 0.129 | 1.941 |
| 1.611 | 0.095 | 1.941 | −1.186 | 0.100 | 1.941 | −0.325 | 0.121 | 1.941 |
| 1.598 | 0.092 | 1.941 | −1.244 | 0.124 | 1.941 | −0.230 | 0.114 | 1.941 |
| 1.582 | 0.089 | 1.941 | −1.295 | 0.146 | 1.941 | −0.135 | 0.108 | 1.941 |
| 1.561 | 0.085 | 1.941 | −1.340 | 0.167 | 1.941 | −0.041 | 0.104 | 1.941 |
| 1.536 | 0.081 | 1.941 | −1.378 | 0.186 | 1.941 | 0.054 | 0.101 | 1.941 |
| 1.506 | 0.076 | 1.941 | −1.410 | 0.202 | 1.941 | 0.149 | 0.100 | 1.941 |
| 1.471 | 0.069 | 1.941 | −1.437 | 0.217 | 1.941 | 0.244 | 0.099 | 1.941 |
| 1.429 | 0.062 | 1.941 | −1.459 | 0.231 | 1.941 | 0.339 | 0.099 | 1.941 |

TABLE 7R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.381 | 0.054 | 1.941 | −1.477 | 0.243 | 1.941 | 0.434 | 0.100 | 1.941 |
| 1.327 | 0.045 | 1.941 | −1.489 | 0.254 | 1.941 | 0.529 | 0.101 | 1.941 |
| 1.266 | 0.035 | 1.941 | −1.498 | 0.264 | 1.941 | 0.624 | 0.102 | 1.941 |
| 1.199 | 0.024 | 1.941 | −1.504 | 0.272 | 1.941 | 0.716 | 0.103 | 1.941 |
| 1.126 | 0.012 | 1.941 | −1.507 | 0.280 | 1.941 | 0.804 | 0.105 | 1.941 |
| 1.049 | 0.000 | 1.941 | −1.508 | 0.287 | 1.941 | 0.890 | 0.107 | 1.941 |
| 0.969 | −0.012 | 1.941 | −1.507 | 0.291 | 1.941 | 0.972 | 0.109 | 1.941 |
| 0.886 | −0.025 | 1.941 | −1.504 | 0.295 | 1.941 | 1.051 | 0.111 | 1.941 |
| 0.799 | −0.037 | 1.941 | −1.499 | 0.300 | 1.941 | 1.127 | 0.114 | 1.941 |
| 0.709 | −0.050 | 1.941 | −1.492 | 0.303 | 1.941 | 1.200 | 0.117 | 1.941 |
| 0.616 | −0.062 | 1.941 | −1.483 | 0.305 | 1.941 | 1.266 | 0.120 | 1.941 |
| 0.520 | −0.074 | 1.941 | −1.470 | 0.306 | 1.941 | 1.326 | 0.123 | 1.941 |
| 0.424 | −0.085 | 1.941 | −1.454 | 0.306 | 1.941 | 1.380 | 0.125 | 1.941 |
| 0.328 | −0.095 | 1.941 | −1.433 | 0.303 | 1.941 | 1.427 | 0.127 | 1.941 |
| 0.231 | −0.103 | 1.941 | −1.408 | 0.299 | 1.941 | 1.468 | 0.129 | 1.941 |
| 0.135 | −0.109 | 1.941 | −1.379 | 0.293 | 1.941 | 1.503 | 0.131 | 1.941 |
| 0.038 | −0.113 | 1.941 | −1.345 | 0.285 | 1.941 | 1.533 | 0.133 | 1.941 |
| −0.059 | −0.114 | 1.941 | −1.305 | 0.276 | 1.941 | 1.558 | 0.135 | 1.941 |
| −0.156 | −0.113 | 1.941 | −1.259 | 0.266 | 1.941 | 1.578 | 0.136 | 1.941 |
| −0.253 | −0.108 | 1.941 | −1.206 | 0.254 | 1.941 | 1.595 | 0.137 | 1.941 |
| −0.350 | −0.101 | 1.941 | −1.148 | 0.241 | 1.941 | 1.607 | 0.137 | 1.941 |
| −0.447 | −0.090 | 1.941 | −1.083 | 0.228 | 1.941 | 1.616 | 0.134 | 1.941 |
| −0.545 | −0.076 | 1.941 | −1.011 | 0.214 | 1.941 | 1.621 | 0.128 | 1.941 |
| −0.638 | −0.060 | 1.941 | −0.937 | 0.200 | 1.941 | 1.624 | 0.122 | 1.941 |
| −0.728 | −0.041 | 1.941 | −0.859 | 0.186 | 1.941 | | | |
| −0.814 | −0.020 | 1.941 | −0.777 | 0.173 | 1.941 | | | |
| 1.598 | −0.031 | 2.911 | −0.901 | 0.003 | 2.911 | −0.701 | 0.139 | 2.911 |
| 1.598 | −0.036 | 2.911 | −0.979 | 0.029 | 2.911 | −0.615 | 0.123 | 2.911 |
| 1.596 | −0.042 | 2.911 | −1.053 | 0.055 | 2.911 | −0.525 | 0.108 | 2.911 |
| 1.591 | −0.048 | 2.911 | −1.123 | 0.082 | 2.911 | −0.432 | 0.093 | 2.911 |
| 1.583 | −0.053 | 2.911 | −1.186 | 0.108 | 2.911 | −0.338 | 0.080 | 2.911 |
| 1.570 | −0.055 | 2.911 | −1.244 | 0.133 | 2.911 | −0.245 | 0.067 | 2.911 |
| 1.554 | −0.057 | 2.911 | −1.294 | 0.156 | 2.911 | −0.151 | 0.056 | 2.911 |
| 1.533 | −0.060 | 2.911 | −1.338 | 0.177 | 2.911 | −0.058 | 0.045 | 2.911 |
| 1.508 | −0.063 | 2.911 | −1.376 | 0.196 | 2.911 | 0.036 | 0.036 | 2.911 |
| 1.478 | −0.067 | 2.911 | −1.408 | 0.213 | 2.911 | 0.130 | 0.028 | 2.911 |
| 1.442 | −0.071 | 2.911 | −1.435 | 0.228 | 2.911 | 0.224 | 0.021 | 2.911 |
| 1.401 | −0.076 | 2.911 | −1.457 | 0.241 | 2.911 | 0.319 | 0.015 | 2.911 |
| 1.353 | −0.082 | 2.911 | −1.475 | 0.253 | 2.911 | 0.413 | 0.010 | 2.911 |
| 1.299 | −0.089 | 2.911 | −1.488 | 0.264 | 2.911 | 0.507 | 0.005 | 2.911 |
| 1.238 | −0.095 | 2.911 | −1.497 | 0.274 | 2.911 | 0.602 | 0.001 | 2.911 |
| 1.171 | −0.102 | 2.911 | −1.502 | 0.282 | 2.911 | 0.693 | −0.002 | 2.911 |
| 1.097 | −0.110 | 2.911 | −1.506 | 0.289 | 2.911 | 0.781 | −0.005 | 2.911 |
| 1.020 | −0.118 | 2.911 | −1.507 | 0.296 | 2.911 | 0.866 | −0.008 | 2.911 |
| 0.940 | −0.125 | 2.911 | −1.506 | 0.300 | 2.911 | 0.948 | −0.010 | 2.911 |
| 0.857 | −0.133 | 2.911 | −1.503 | 0.304 | 2.911 | 1.026 | −0.011 | 2.911 |
| 0.770 | −0.140 | 2.911 | −1.498 | 0.308 | 2.911 | 1.102 | −0.013 | 2.911 |
| 0.680 | −0.148 | 2.911 | −1.491 | 0.311 | 2.911 | 1.174 | −0.013 | 2.911 |
| 0.588 | −0.154 | 2.911 | −1.481 | 0.312 | 2.911 | 1.240 | −0.013 | 2.911 |
| 0.492 | −0.160 | 2.911 | −1.469 | 0.313 | 2.911 | 1.300 | −0.013 | 2.911 |
| 0.396 | −0.164 | 2.911 | −1.452 | 0.312 | 2.911 | 1.354 | −0.013 | 2.911 |
| 0.300 | −0.167 | 2.911 | −1.432 | 0.308 | 2.911 | 1.401 | −0.013 | 2.911 |
| 0.204 | −0.168 | 2.911 | −1.408 | 0.303 | 2.911 | 1.442 | −0.013 | 2.911 |
| 0.109 | −0.166 | 2.911 | −1.379 | 0.295 | 2.911 | 1.477 | −0.013 | 2.911 |
| 0.013 | −0.163 | 2.911 | −1.346 | 0.286 | 2.911 | 1.506 | −0.012 | 2.911 |
| −0.082 | −0.157 | 2.911 | −1.306 | 0.276 | 2.911 | 1.531 | −0.012 | 2.911 |
| −0.177 | −0.149 | 2.911 | −1.260 | 0.264 | 2.911 | 1.551 | −0.011 | 2.911 |
| −0.272 | −0.138 | 2.911 | −1.208 | 0.251 | 2.911 | 1.568 | −0.011 | 2.911 |
| −0.367 | −0.124 | 2.911 | −1.150 | 0.236 | 2.911 | 1.580 | −0.011 | 2.911 |
| −0.461 | −0.108 | 2.911 | −1.086 | 0.221 | 2.911 | 1.589 | −0.015 | 2.911 |
| −0.556 | −0.089 | 2.911 | −1.016 | 0.204 | 2.911 | 1.595 | −0.020 | 2.911 |
| −0.647 | −0.068 | 2.911 | −0.942 | 0.188 | 2.911 | 1.597 | −0.026 | 2.911 |
| −0.735 | −0.046 | 2.911 | −0.865 | 0.171 | 2.911 | | | |
| −0.820 | −0.022 | 2.911 | −0.785 | 0.155 | 2.911 | | | |
| 1.584 | −0.206 | 3.881 | −0.901 | −0.027 | 3.881 | −0.698 | 0.092 | 3.881 |
| 1.584 | −0.211 | 3.881 | −0.977 | 0.002 | 3.881 | −0.612 | 0.073 | 3.881 |
| 1.582 | −0.217 | 3.881 | −1.049 | 0.031 | 3.881 | −0.523 | 0.055 | 3.881 |
| 1.576 | −0.223 | 3.881 | −1.118 | 0.059 | 3.881 | −0.431 | 0.036 | 3.881 |
| 1.568 | −0.227 | 3.881 | −1.180 | 0.087 | 3.881 | −0.338 | 0.019 | 3.881 |
| 1.555 | −0.228 | 3.881 | −1.236 | 0.113 | 3.881 | −0.246 | 0.002 | 3.881 |
| 1.538 | −0.230 | 3.881 | −1.286 | 0.137 | 3.881 | −0.153 | −0.014 | 3.881 |
| 1.518 | −0.231 | 3.881 | −1.329 | 0.159 | 3.881 | −0.060 | −0.029 | 3.881 |
| 1.492 | −0.233 | 3.881 | −1.367 | 0.179 | 3.881 | 0.033 | −0.043 | 3.881 |
| 1.462 | −0.235 | 3.881 | −1.398 | 0.196 | 3.881 | 0.126 | −0.057 | 3.881 |
| 1.427 | −0.237 | 3.881 | −1.424 | 0.211 | 3.881 | 0.220 | −0.070 | 3.881 |
| 1.385 | −0.240 | 3.881 | −1.446 | 0.224 | 3.881 | 0.313 | −0.082 | 3.881 |
| 1.337 | −0.243 | 3.881 | −1.464 | 0.236 | 3.881 | 0.407 | −0.093 | 3.881 |

TABLE 7R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.283 | −0.246 | 3.881 | −1.477 | 0.247 | 3.881 | 0.500 | −0.104 | 3.881 |
| 1.222 | −0.249 | 3.881 | −1.486 | 0.256 | 3.881 | 0.594 | −0.114 | 3.881 |
| 1.155 | −0.253 | 3.881 | −1.491 | 0.264 | 3.881 | 0.684 | −0.123 | 3.881 |
| 1.081 | −0.256 | 3.881 | −1.495 | 0.271 | 3.881 | 0.772 | −0.132 | 3.881 |
| 1.004 | −0.259 | 3.881 | −1.496 | 0.278 | 3.881 | 0.856 | −0.140 | 3.881 |
| 0.924 | −0.262 | 3.881 | −1.495 | 0.282 | 3.881 | 0.938 | −0.147 | 3.881 |
| 0.841 | −0.264 | 3.881 | −1.492 | 0.286 | 3.881 | 1.016 | −0.154 | 3.881 |
| 0.754 | −0.266 | 3.881 | −1.487 | 0.290 | 3.881 | 1.091 | −0.159 | 3.881 |
| 0.665 | −0.267 | 3.881 | −1.479 | 0.292 | 3.881 | 1.163 | −0.165 | 3.881 |
| 0.572 | −0.268 | 3.881 | −1.470 | 0.293 | 3.881 | 1.229 | −0.169 | 3.881 |
| 0.477 | −0.267 | 3.881 | −1.457 | 0.293 | 3.881 | 1.289 | −0.172 | 3.881 |
| 0.381 | −0.264 | 3.881 | −1.441 | 0.291 | 3.881 | 1.342 | −0.175 | 3.881 |
| 0.286 | −0.260 | 3.881 | −1.421 | 0.287 | 3.881 | 1.389 | −0.178 | 3.881 |
| 0.191 | −0.255 | 3.881 | −1.397 | 0.280 | 3.881 | 1.430 | −0.180 | 3.881 |
| 0.096 | −0.247 | 3.881 | −1.369 | 0.272 | 3.881 | 1.464 | −0.182 | 3.881 |
| 0.001 | −0.237 | 3.881 | −1.335 | 0.262 | 3.881 | 1.494 | −0.183 | 3.881 |
| −0.093 | −0.225 | 3.881 | −1.296 | 0.251 | 3.881 | 1.519 | −0.184 | 3.881 |
| −0.188 | −0.211 | 3.881 | −1.251 | 0.238 | 3.881 | 1.539 | −0.185 | 3.881 |
| −0.282 | −0.195 | 3.881 | −1.200 | 0.223 | 3.881 | 1.555 | −0.185 | 3.881 |
| −0.375 | −0.176 | 3.881 | −1.142 | 0.206 | 3.881 | 1.568 | −0.186 | 3.881 |
| −0.469 | −0.155 | 3.881 | −1.079 | 0.188 | 3.881 | 1.576 | −0.190 | 3.881 |
| −0.562 | −0.132 | 3.881 | −1.009 | 0.169 | 3.881 | 1.582 | −0.196 | 3.881 |
| −0.652 | −0.107 | 3.881 | −0.936 | 0.150 | 3.881 | 1.584 | −0.202 | 3.881 |
| −0.738 | −0.081 | 3.881 | −0.860 | 0.130 | 3.881 | | | |
| −0.822 | −0.054 | 3.881 | −0.781 | 0.111 | 3.881 | | | |
| 1.568 | −0.354 | 4.852 | −0.904 | −0.065 | 4.852 | −0.699 | 0.041 | 4.852 |
| 1.567 | −0.359 | 4.852 | −0.978 | −0.034 | 4.852 | −0.614 | 0.019 | 4.852 |
| 1.565 | −0.365 | 4.852 | −1.050 | −0.004 | 4.852 | −0.525 | −0.002 | 4.852 |
| 1.559 | −0.371 | 4.852 | −1.117 | 0.027 | 4.852 | −0.434 | −0.024 | 4.852 |
| 1.550 | −0.374 | 4.852 | −1.178 | 0.056 | 4.852 | −0.342 | −0.044 | 4.852 |
| 1.537 | −0.374 | 4.852 | −1.233 | 0.083 | 4.852 | −0.250 | −0.064 | 4.852 |
| 1.520 | −0.375 | 4.852 | −1.282 | 0.108 | 4.852 | −0.158 | −0.083 | 4.852 |
| 1.500 | −0.375 | 4.852 | −1.325 | 0.131 | 4.852 | −0.065 | −0.101 | 4.852 |
| 1.474 | −0.376 | 4.852 | −1.361 | 0.151 | 4.852 | 0.027 | −0.119 | 4.852 |
| 1.444 | −0.376 | 4.852 | −1.392 | 0.169 | 4.852 | 0.120 | −0.136 | 4.852 |
| 1.409 | −0.377 | 4.852 | −1.418 | 0.184 | 4.852 | 0.212 | −0.153 | 4.852 |
| 1.367 | −0.378 | 4.852 | −1.440 | 0.197 | 4.852 | 0.305 | −0.170 | 4.852 |
| 1.319 | −0.379 | 4.852 | −1.457 | 0.209 | 4.852 | 0.398 | −0.185 | 4.852 |
| 1.265 | −0.379 | 4.852 | −1.470 | 0.220 | 4.852 | 0.491 | −0.201 | 4.852 |
| 1.204 | −0.380 | 4.852 | −1.479 | 0.229 | 4.852 | 0.584 | −0.215 | 4.852 |
| 1.137 | −0.380 | 4.852 | −1.485 | 0.237 | 4.852 | 0.674 | −0.229 | 4.852 |
| 1.063 | −0.381 | 4.852 | −1.489 | 0.244 | 4.852 | 0.761 | −0.241 | 4.852 |
| 0.987 | −0.381 | 4.852 | −1.490 | 0.250 | 4.852 | 0.844 | −0.253 | 4.852 |
| 0.907 | −0.381 | 4.852 | −1.489 | 0.255 | 4.852 | 0.925 | −0.264 | 4.852 |
| 0.823 | −0.380 | 4.852 | −1.486 | 0.259 | 4.852 | 1.003 | −0.274 | 4.852 |
| 0.737 | −0.378 | 4.852 | −1.480 | 0.262 | 4.852 | 1.078 | −0.283 | 4.852 |
| 0.648 | −0.375 | 4.852 | −1.473 | 0.264 | 4.852 | 1.149 | −0.292 | 4.852 |
| 0.556 | −0.371 | 4.852 | −1.463 | 0.265 | 4.852 | 1.215 | −0.299 | 4.852 |
| 0.460 | −0.366 | 4.852 | −1.451 | 0.264 | 4.852 | 1.274 | −0.306 | 4.852 |
| 0.365 | −0.359 | 4.852 | −1.434 | 0.261 | 4.852 | 1.327 | −0.311 | 4.852 |
| 0.271 | −0.350 | 4.852 | −1.415 | 0.256 | 4.852 | 1.374 | −0.316 | 4.852 |
| 0.176 | −0.339 | 4.852 | −1.391 | 0.249 | 4.852 | 1.415 | −0.320 | 4.852 |
| 0.082 | −0.327 | 4.852 | −1.363 | 0.240 | 4.852 | 1.449 | −0.324 | 4.852 |
| −0.012 | −0.312 | 4.852 | −1.330 | 0.229 | 4.852 | 1.478 | −0.327 | 4.852 |
| −0.106 | −0.296 | 4.852 | −1.291 | 0.217 | 4.852 | 1.503 | −0.329 | 4.852 |
| −0.199 | −0.277 | 4.852 | −1.246 | 0.202 | 4.852 | 1.523 | −0.331 | 4.852 |
| −0.292 | −0.257 | 4.852 | −1.196 | 0.186 | 4.852 | 1.540 | −0.332 | 4.852 |
| −0.385 | −0.234 | 4.852 | −1.139 | 0.168 | 4.852 | 1.552 | −0.334 | 4.852 |
| −0.477 | −0.209 | 4.852 | −1.076 | 0.148 | 4.852 | 1.561 | −0.338 | 4.852 |
| −0.570 | −0.182 | 4.852 | −1.007 | 0.127 | 4.852 | 1.566 | −0.344 | 4.852 |
| −0.658 | −0.154 | 4.852 | −0.935 | 0.106 | 4.852 | 1.568 | −0.350 | 4.852 |
| −0.744 | −0.125 | 4.852 | −0.859 | 0.084 | 4.852 | | | |
| −0.826 | −0.095 | 4.852 | −0.781 | 0.062 | 4.852 | | | |
| 1.535 | −0.485 | 5.822 | −0.918 | −0.091 | 5.822 | −0.712 | 0.002 | 5.822 |
| 1.534 | −0.489 | 5.822 | −0.991 | −0.058 | 5.822 | −0.628 | −0.022 | 5.822 |
| 1.531 | −0.495 | 5.822 | −1.061 | −0.026 | 5.822 | −0.540 | −0.046 | 5.822 |
| 1.525 | −0.500 | 5.822 | −1.128 | 0.006 | 5.822 | −0.449 | −0.070 | 5.822 |
| 1.516 | −0.502 | 5.822 | −1.188 | 0.037 | 5.822 | −0.358 | −0.094 | 5.822 |
| 1.503 | −0.502 | 5.822 | −1.242 | 0.065 | 5.822 | −0.267 | −0.116 | 5.822 |
| 1.487 | −0.501 | 5.822 | −1.290 | 0.091 | 5.822 | −0.175 | −0.138 | 5.822 |
| 1.466 | −0.501 | 5.822 | −1.332 | 0.115 | 5.822 | −0.084 | −0.159 | 5.822 |
| 1.441 | −0.500 | 5.822 | −1.368 | 0.135 | 5.822 | 0.008 | −0.179 | 5.822 |
| 1.411 | −0.499 | 5.822 | −1.398 | 0.154 | 5.822 | 0.100 | −0.199 | 5.822 |
| 1.376 | −0.498 | 5.822 | −1.424 | 0.169 | 5.822 | 0.192 | −0.219 | 5.822 |
| 1.334 | −0.497 | 5.822 | −1.446 | 0.183 | 5.822 | 0.284 | −0.238 | 5.822 |
| 1.286 | −0.496 | 5.822 | −1.463 | 0.195 | 5.822 | 0.376 | −0.258 | 5.822 |
| 1.232 | −0.494 | 5.822 | −1.476 | 0.205 | 5.822 | 0.468 | −0.276 | 5.822 |

TABLE 7R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.171 | −0.492 | 5.822 | −1.485 | 0.214 | 5.822 | 0.560 | −0.295 | 5.822 |
| 1.104 | −0.490 | 5.822 | −1.491 | 0.222 | 5.822 | 0.649 | −0.312 | 5.822 |
| 1.031 | −0.487 | 5.822 | −1.494 | 0.229 | 5.822 | 0.735 | −0.329 | 5.822 |
| 0.955 | −0.484 | 5.822 | −1.496 | 0.235 | 5.822 | 0.818 | −0.345 | 5.822 |
| 0.875 | −0.480 | 5.822 | −1.495 | 0.240 | 5.822 | 0.898 | −0.360 | 5.822 |
| 0.792 | −0.476 | 5.822 | −1.492 | 0.244 | 5.822 | 0.975 | −0.374 | 5.822 |
| 0.706 | −0.470 | 5.822 | −1.486 | 0.246 | 5.822 | 1.050 | −0.387 | 5.822 |
| 0.618 | −0.464 | 5.822 | −1.478 | 0.248 | 5.822 | 1.121 | −0.399 | 5.822 |
| 0.526 | −0.456 | 5.822 | −1.469 | 0.248 | 5.822 | 1.185 | −0.410 | 5.822 |
| 0.431 | −0.446 | 5.822 | −1.456 | 0.246 | 5.822 | 1.244 | −0.420 | 5.822 |
| 0.337 | −0.435 | 5.822 | −1.440 | 0.243 | 5.822 | 1.297 | −0.429 | 5.822 |
| 0.243 | −0.422 | 5.822 | −1.421 | 0.237 | 5.822 | 1.343 | −0.436 | 5.822 |
| 0.149 | −0.407 | 5.822 | −1.397 | 0.229 | 5.822 | 1.383 | −0.443 | 5.822 |
| 0.055 | −0.391 | 5.822 | −1.369 | 0.220 | 5.822 | 1.417 | −0.448 | 5.822 |
| −0.038 | −0.372 | 5.822 | −1.337 | 0.208 | 5.822 | 1.447 | −0.452 | 5.822 |
| −0.130 | −0.351 | 5.822 | −1.298 | 0.195 | 5.822 | 1.471 | −0.456 | 5.822 |
| −0.223 | −0.329 | 5.822 | −1.254 | 0.179 | 5.822 | 1.491 | −0.459 | 5.822 |
| −0.315 | −0.304 | 5.822 | −1.204 | 0.161 | 5.822 | 1.507 | −0.462 | 5.822 |
| −0.407 | −0.278 | 5.822 | −1.148 | 0.142 | 5.822 | 1.520 | −0.464 | 5.822 |
| −0.498 | −0.249 | 5.822 | −1.085 | 0.120 | 5.822 | 1.528 | −0.468 | 5.822 |
| −0.589 | −0.219 | 5.822 | −1.017 | 0.097 | 5.822 | 1.533 | −0.474 | 5.822 |
| −0.677 | −0.188 | 5.822 | −0.946 | 0.074 | 5.822 | 1.535 | −0.480 | 5.822 |
| −0.761 | −0.156 | 5.822 | −0.871 | 0.050 | 5.822 | | | |
| −0.841 | −0.124 | 5.822 | −0.793 | 0.026 | 5.822 | | | |
| 1.486 | −0.552 | 6.550 | −0.950 | −0.083 | 6.550 | −0.743 | −0.001 | 6.550 |
| 1.485 | −0.557 | 6.550 | −1.022 | −0.049 | 6.550 | −0.659 | −0.027 | 6.550 |
| 1.481 | −0.562 | 6.550 | −1.091 | −0.015 | 6.550 | −0.573 | −0.053 | 6.550 |
| 1.475 | −0.567 | 6.550 | −1.157 | 0.019 | 6.550 | −0.482 | −0.079 | 6.550 |
| 1.465 | −0.568 | 6.550 | −1.216 | 0.050 | 6.550 | −0.392 | −0.104 | 6.550 |
| 1.453 | −0.567 | 6.550 | −1.269 | 0.080 | 6.550 | −0.302 | −0.128 | 6.550 |
| 1.436 | −0.566 | 6.550 | −1.316 | 0.107 | 6.550 | −0.211 | −0.151 | 6.550 |
| 1.416 | −0.565 | 6.550 | −1.358 | 0.131 | 6.550 | −0.120 | −0.174 | 6.550 |
| 1.390 | −0.564 | 6.550 | −1.393 | 0.152 | 6.550 | −0.029 | −0.196 | 6.550 |
| 1.361 | −0.562 | 6.550 | −1.423 | 0.171 | 6.550 | 0.063 | −0.218 | 6.550 |
| 1.326 | −0.560 | 6.550 | −1.448 | 0.187 | 6.550 | 0.154 | −0.240 | 6.550 |
| 1.284 | −0.557 | 6.550 | −1.469 | 0.201 | 6.550 | 0.245 | −0.261 | 6.550 |
| 1.237 | −0.555 | 6.550 | −1.487 | 0.213 | 6.550 | 0.337 | −0.283 | 6.550 |
| 1.183 | −0.551 | 6.550 | −1.500 | 0.224 | 6.550 | 0.428 | −0.304 | 6.550 |
| 1.122 | −0.548 | 6.550 | −1.509 | 0.233 | 6.550 | 0.520 | −0.325 | 6.550 |
| 1.055 | −0.543 | 6.550 | −1.515 | 0.240 | 6.550 | 0.608 | −0.346 | 6.550 |
| 0.982 | −0.538 | 6.550 | −1.519 | 0.247 | 6.550 | 0.693 | −0.365 | 6.550 |
| 0.906 | −0.533 | 6.550 | −1.520 | 0.253 | 6.550 | 0.776 | −0.384 | 6.550 |
| 0.827 | −0.527 | 6.550 | −1.519 | 0.258 | 6.550 | 0.855 | −0.402 | 6.550 |
| 0.744 | −0.520 | 6.550 | −1.516 | 0.261 | 6.550 | 0.931 | −0.419 | 6.550 |
| 0.659 | −0.512 | 6.550 | −1.510 | 0.264 | 6.550 | 1.005 | −0.435 | 6.550 |
| 0.571 | −0.503 | 6.550 | −1.502 | 0.265 | 6.550 | 1.075 | −0.450 | 6.550 |
| 0.480 | −0.492 | 6.550 | −1.493 | 0.264 | 6.550 | 1.139 | −0.464 | 6.550 |
| 0.385 | −0.479 | 6.550 | −1.480 | 0.262 | 6.550 | 1.197 | −0.476 | 6.550 |
| 0.292 | −0.465 | 6.550 | −1.465 | 0.257 | 6.550 | 1.250 | −0.487 | 6.550 |
| 0.198 | −0.449 | 6.550 | −1.445 | 0.251 | 6.550 | 1.295 | −0.496 | 6.550 |
| 0.105 | −0.431 | 6.550 | −1.422 | 0.242 | 6.550 | 1.335 | −0.504 | 6.550 |
| 0.013 | −0.411 | 6.550 | −1.395 | 0.232 | 6.550 | 1.369 | −0.511 | 6.550 |
| −0.080 | −0.389 | 6.550 | −1.362 | 0.219 | 6.550 | 1.398 | −0.517 | 6.550 |
| −0.172 | −0.365 | 6.550 | −1.324 | 0.205 | 6.550 | 1.422 | −0.522 | 6.550 |
| −0.263 | −0.339 | 6.550 | −1.280 | 0.188 | 6.550 | 1.442 | −0.526 | 6.550 |
| −0.354 | −0.312 | 6.550 | −1.231 | 0.169 | 6.550 | 1.458 | −0.529 | 6.550 |
| −0.445 | −0.283 | 6.550 | −1.175 | 0.148 | 6.550 | 1.470 | −0.531 | 6.550 |
| −0.535 | −0.252 | 6.550 | −1.113 | 0.126 | 6.550 | 1.479 | −0.535 | 6.550 |
| −0.625 | −0.219 | 6.550 | −1.045 | 0.101 | 6.550 | 1.484 | −0.541 | 6.550 |
| −0.712 | −0.185 | 6.550 | −0.975 | 0.076 | 6.550 | 1.486 | −0.547 | 6.550 |
| −0.795 | −0.151 | 6.550 | −0.901 | 0.051 | 6.550 | | | |
| −0.874 | −0.117 | 6.550 | −0.823 | 0.025 | 6.550 | | | |
| 1.460 | −0.570 | 6.792 | −0.966 | −0.064 | 6.792 | −0.760 | 0.012 | 6.792 |
| 1.459 | −0.574 | 6.792 | −1.038 | −0.029 | 6.792 | −0.677 | −0.016 | 6.792 |
| 1.456 | −0.580 | 6.792 | −1.106 | 0.006 | 6.792 | −0.591 | −0.043 | 6.792 |
| 1.449 | −0.584 | 6.792 | −1.171 | 0.041 | 6.792 | −0.501 | −0.071 | 6.792 |
| 1.440 | −0.585 | 6.792 | −1.230 | 0.074 | 6.792 | −0.411 | −0.097 | 6.792 |
| 1.427 | −0.584 | 6.792 | −1.283 | 0.104 | 6.792 | −0.321 | −0.123 | 6.792 |
| 1.411 | −0.583 | 6.792 | −1.329 | 0.132 | 6.792 | −0.231 | −0.148 | 6.792 |
| 1.390 | −0.582 | 6.792 | −1.370 | 0.157 | 6.792 | −0.140 | −0.172 | 6.792 |
| 1.365 | −0.580 | 6.792 | −1.405 | 0.179 | 6.792 | −0.049 | −0.195 | 6.792 |
| 1.335 | −0.578 | 6.792 | −1.435 | 0.198 | 6.792 | 0.042 | −0.218 | 6.792 |
| 1.300 | −0.576 | 6.792 | −1.460 | 0.215 | 6.792 | 0.133 | −0.240 | 6.792 |
| 1.259 | −0.573 | 6.792 | −1.481 | 0.229 | 6.792 | 0.224 | −0.263 | 6.792 |
| 1.211 | −0.570 | 6.792 | −1.498 | 0.241 | 6.792 | 0.315 | −0.285 | 6.792 |
| 1.157 | −0.566 | 6.792 | −1.511 | 0.252 | 6.792 | 0.406 | −0.308 | 6.792 |
| 1.097 | −0.562 | 6.792 | −1.520 | 0.260 | 6.792 | 0.497 | −0.330 | 6.792 |

TABLE 7R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.030 | −0.557 | 6.792 | −1.526 | 0.268 | 6.792 | 0.586 | −0.351 | 6.792 |
| 0.957 | −0.551 | 6.792 | −1.530 | 0.275 | 6.792 | 0.671 | −0.372 | 6.792 |
| 0.881 | −0.545 | 6.792 | −1.531 | 0.281 | 6.792 | 0.753 | −0.392 | 6.792 |
| 0.802 | −0.538 | 6.792 | −1.530 | 0.286 | 6.792 | 0.832 | −0.411 | 6.792 |
| 0.719 | −0.531 | 6.792 | −1.527 | 0.289 | 6.792 | 0.908 | −0.429 | 6.792 |
| 0.634 | −0.522 | 6.792 | −1.521 | 0.291 | 6.792 | 0.981 | −0.446 | 6.792 |
| 0.546 | −0.511 | 6.792 | −1.513 | 0.292 | 6.792 | 1.051 | −0.463 | 6.792 |
| 0.455 | −0.499 | 6.792 | −1.504 | 0.291 | 6.792 | 1.115 | −0.477 | 6.792 |
| 0.361 | −0.485 | 6.792 | −1.491 | 0.288 | 6.792 | 1.173 | −0.490 | 6.792 |
| 0.268 | −0.469 | 6.792 | −1.476 | 0.283 | 6.792 | 1.225 | −0.502 | 6.792 |
| 0.175 | −0.452 | 6.792 | −1.457 | 0.276 | 6.792 | 1.271 | −0.512 | 6.792 |
| 0.082 | −0.432 | 6.792 | −1.434 | 0.267 | 6.792 | 1.311 | −0.520 | 6.792 |
| −0.010 | −0.410 | 6.792 | −1.406 | 0.256 | 6.792 | 1.344 | −0.528 | 6.792 |
| −0.102 | −0.387 | 6.792 | −1.374 | 0.244 | 6.792 | 1.373 | −0.534 | 6.792 |
| −0.194 | −0.362 | 6.792 | −1.337 | 0.228 | 6.792 | 1.397 | −0.539 | 6.792 |
| −0.285 | −0.334 | 6.792 | −1.293 | 0.211 | 6.792 | 1.417 | −0.543 | 6.792 |
| −0.375 | −0.305 | 6.792 | −1.244 | 0.191 | 6.792 | 1.433 | −0.546 | 6.792 |
| −0.466 | −0.274 | 6.792 | −1.188 | 0.169 | 6.792 | 1.445 | −0.549 | 6.792 |
| −0.555 | −0.241 | 6.792 | −1.127 | 0.145 | 6.792 | 1.454 | −0.553 | 6.792 |
| −0.645 | −0.206 | 6.792 | −1.060 | 0.119 | 6.792 | 1.459 | −0.559 | 6.792 |
| −0.731 | −0.171 | 6.792 | −0.990 | 0.093 | 6.792 | 1.461 | −0.565 | 6.792 |
| −0.813 | −0.136 | 6.792 | −0.916 | 0.066 | 6.792 | | | |
| −0.891 | −0.100 | 6.792 | −0.840 | 0.039 | 6.792 | | | |
| 1.384 | −0.592 | 7.277 | −1.016 | 0.017 | 7.277 | −0.810 | 0.077 | 7.277 |
| 1.383 | −0.596 | 7.277 | −1.085 | 0.056 | 7.277 | −0.729 | 0.045 | 7.277 |
| 1.379 | −0.601 | 7.277 | −1.152 | 0.095 | 7.277 | −0.645 | 0.013 | 7.277 |
| 1.372 | −0.606 | 7.277 | −1.215 | 0.133 | 7.277 | −0.557 | −0.019 | 7.277 |
| 1.363 | −0.606 | 7.277 | −1.272 | 0.169 | 7.277 | −0.468 | −0.050 | 7.277 |
| 1.350 | −0.606 | 7.277 | −1.323 | 0.201 | 7.277 | −0.380 | −0.081 | 7.277 |
| 1.334 | −0.604 | 7.277 | −1.368 | 0.231 | 7.277 | −0.291 | −0.110 | 7.277 |
| 1.313 | −0.603 | 7.277 | −1.408 | 0.258 | 7.277 | −0.201 | −0.138 | 7.277 |
| 1.288 | −0.600 | 7.277 | −1.442 | 0.282 | 7.277 | −0.112 | −0.166 | 7.277 |
| 1.258 | −0.598 | 7.277 | −1.471 | 0.302 | 7.277 | −0.022 | −0.193 | 7.277 |
| 1.223 | −0.595 | 7.277 | −1.495 | 0.320 | 7.277 | 0.068 | −0.219 | 7.277 |
| 1.181 | −0.592 | 7.277 | −1.515 | 0.335 | 7.277 | 0.158 | −0.245 | 7.277 |
| 1.134 | −0.588 | 7.277 | −1.532 | 0.348 | 7.277 | 0.249 | −0.270 | 7.277 |
| 1.080 | −0.583 | 7.277 | −1.545 | 0.358 | 7.277 | 0.339 | −0.296 | 7.277 |
| 1.019 | −0.578 | 7.277 | −1.554 | 0.368 | 7.277 | 0.429 | −0.322 | 7.277 |
| 0.952 | −0.572 | 7.277 | −1.560 | 0.375 | 7.277 | 0.516 | −0.346 | 7.277 |
| 0.879 | −0.565 | 7.277 | −1.563 | 0.382 | 7.277 | 0.601 | −0.370 | 7.277 |
| 0.803 | −0.557 | 7.277 | −1.565 | 0.388 | 7.277 | 0.682 | −0.393 | 7.277 |
| 0.724 | −0.549 | 7.277 | −1.564 | 0.393 | 7.277 | 0.760 | −0.415 | 7.277 |
| 0.642 | −0.539 | 7.277 | −1.560 | 0.396 | 7.277 | 0.836 | −0.435 | 7.277 |
| 0.557 | −0.527 | 7.277 | −1.554 | 0.398 | 7.277 | 0.908 | −0.455 | 7.277 |
| 0.469 | −0.513 | 7.277 | −1.546 | 0.397 | 7.277 | 0.977 | −0.474 | 7.277 |
| 0.379 | −0.497 | 7.277 | −1.537 | 0.396 | 7.277 | 1.041 | −0.490 | 7.277 |
| 0.286 | −0.479 | 7.277 | −1.525 | 0.392 | 7.277 | 1.099 | −0.505 | 7.277 |
| 0.193 | −0.458 | 7.277 | −1.510 | 0.386 | 7.277 | 1.150 | −0.518 | 7.277 |
| 0.101 | −0.436 | 7.277 | −1.491 | 0.378 | 7.277 | 1.196 | −0.530 | 7.277 |
| 0.010 | −0.411 | 7.277 | −1.469 | 0.368 | 7.277 | 1.235 | −0.539 | 7.277 |
| −0.081 | −0.384 | 7.277 | −1.442 | 0.356 | 7.277 | 1.268 | −0.547 | 7.277 |
| −0.171 | −0.355 | 7.277 | −1.411 | 0.342 | 7.277 | 1.297 | −0.554 | 7.277 |
| −0.261 | −0.324 | 7.277 | −1.374 | 0.325 | 7.277 | 1.321 | −0.560 | 7.277 |
| −0.350 | −0.292 | 7.277 | −1.331 | 0.305 | 7.277 | 1.341 | −0.564 | 7.277 |
| −0.439 | −0.257 | 7.277 | −1.283 | 0.283 | 7.277 | 1.357 | −0.568 | 7.277 |
| −0.527 | −0.221 | 7.277 | −1.229 | 0.258 | 7.277 | 1.369 | −0.571 | 7.277 |
| −0.615 | −0.183 | 7.277 | −1.169 | 0.231 | 7.277 | 1.377 | −0.575 | 7.277 |
| −0.702 | −0.143 | 7.277 | −1.104 | 0.201 | 7.277 | 1.382 | −0.581 | 7.277 |
| −0.786 | −0.103 | 7.277 | −1.035 | 0.171 | 7.277 | 1.384 | −0.587 | 7.277 |
| −0.866 | −0.063 | 7.277 | −0.963 | 0.140 | 7.277 | | | |
| −0.943 | −0.023 | 7.277 | −0.889 | 0.109 | 7.277 | | | |
| 1.320 | −0.601 | 7.641 | −1.055 | 0.093 | 7.641 | −0.850 | 0.143 | 7.641 |
| 1.319 | −0.606 | 7.641 | −1.124 | 0.135 | 7.641 | −0.771 | 0.107 | 7.641 |
| 1.315 | −0.611 | 7.641 | −1.188 | 0.176 | 7.641 | −0.687 | 0.071 | 7.641 |
| 1.308 | −0.615 | 7.641 | −1.250 | 0.217 | 7.641 | −0.601 | 0.034 | 7.641 |
| 1.299 | −0.615 | 7.641 | −1.306 | 0.254 | 7.641 | −0.514 | −0.001 | 7.641 |
| 1.286 | −0.614 | 7.641 | −1.356 | 0.288 | 7.641 | −0.427 | −0.036 | 7.641 |
| 1.269 | −0.613 | 7.641 | −1.400 | 0.320 | 7.641 | −0.339 | −0.069 | 7.641 |
| 1.249 | −0.611 | 7.641 | −1.439 | 0.348 | 7.641 | −0.251 | −0.102 | 7.641 |
| 1.223 | −0.609 | 7.641 | −1.473 | 0.372 | 7.641 | −0.163 | −0.133 | 7.641 |
| 1.193 | −0.606 | 7.641 | −1.501 | 0.394 | 7.641 | −0.074 | −0.164 | 7.641 |
| 1.158 | −0.603 | 7.641 | −1.525 | 0.412 | 7.641 | 0.015 | −0.194 | 7.641 |
| 1.117 | −0.599 | 7.641 | −1.544 | 0.428 | 7.641 | 0.104 | −0.223 | 7.641 |
| 1.069 | −0.594 | 7.641 | −1.561 | 0.441 | 7.641 | 0.193 | −0.251 | 7.641 |
| 1.015 | −0.589 | 7.641 | −1.573 | 0.452 | 7.641 | 0.282 | −0.280 | 7.641 |
| 0.954 | −0.584 | 7.641 | −1.582 | 0.461 | 7.641 | 0.372 | −0.308 | 7.641 |
| 0.888 | −0.577 | 7.641 | −1.588 | 0.468 | 7.641 | 0.458 | −0.336 | 7.641 |

TABLE 7R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.814 | −0.569 | 7.641 | −1.592 | 0.475 | 7.641 | 0.542 | −0.362 | 7.641 |
| 0.738 | −0.561 | 7.641 | −1.593 | 0.482 | 7.641 | 0.622 | −0.387 | 7.641 |
| 0.659 | −0.550 | 7.641 | −1.592 | 0.486 | 7.641 | 0.700 | −0.411 | 7.641 |
| 0.577 | −0.538 | 7.641 | −1.589 | 0.489 | 7.641 | 0.775 | −0.433 | 7.641 |
| 0.493 | −0.524 | 7.641 | −1.583 | 0.490 | 7.641 | 0.847 | −0.455 | 7.641 |
| 0.405 | −0.508 | 7.641 | −1.575 | 0.490 | 7.641 | 0.916 | −0.475 | 7.641 |
| 0.316 | −0.488 | 7.641 | −1.566 | 0.488 | 7.641 | 0.979 | −0.493 | 7.641 |
| 0.224 | −0.466 | 7.641 | −1.554 | 0.484 | 7.641 | 1.036 | −0.509 | 7.641 |
| 0.132 | −0.441 | 7.641 | −1.539 | 0.477 | 7.641 | 1.087 | −0.523 | 7.641 |
| 0.041 | −0.414 | 7.641 | −1.521 | 0.468 | 7.641 | 1.133 | −0.536 | 7.641 |
| −0.049 | −0.385 | 7.641 | −1.498 | 0.457 | 7.641 | 1.172 | −0.546 | 7.641 |
| −0.138 | −0.353 | 7.641 | −1.472 | 0.444 | 7.641 | 1.205 | −0.555 | 7.641 |
| −0.227 | −0.319 | 7.641 | −1.441 | 0.429 | 7.641 | 1.234 | −0.562 | 7.641 |
| −0.316 | −0.284 | 7.641 | −1.405 | 0.411 | 7.641 | 1.258 | −0.568 | 7.641 |
| −0.404 | −0.246 | 7.641 | −1.363 | 0.390 | 7.641 | 1.277 | −0.573 | 7.641 |
| −0.491 | −0.207 | 7.641 | −1.315 | 0.366 | 7.641 | 1.293 | −0.577 | 7.641 |
| −0.578 | −0.166 | 7.641 | −1.262 | 0.339 | 7.641 | 1.305 | −0.580 | 7.641 |
| −0.664 | −0.124 | 7.641 | −1.203 | 0.310 | 7.641 | 1.314 | −0.584 | 7.641 |
| −0.749 | −0.080 | 7.641 | −1.139 | 0.278 | 7.641 | 1.319 | −0.590 | 7.641 |
| −0.831 | −0.036 | 7.641 | −1.071 | 0.246 | 7.641 | 1.320 | −0.596 | 7.641 |
| −0.909 | 0.008 | 7.641 | −1.001 | 0.212 | 7.641 | | | |
| −0.984 | 0.051 | 7.641 | −0.927 | 0.178 | 7.641 | | | |

The coordinate values given in TABLE 8R below provide the nominal profile envelope for an exemplary eighth stage rotor.

TABLE 8R

| X-LOC | Y-LOC | Z-LOC | X-LOC | Y-LOC | Z-LOC | X-LOC | Y-LOC | Z-LOC |
|---|---|---|---|---|---|---|---|---|
| 1.821 | 0.012 | 0.000 | −0.937 | −0.060 | 0.000 | −0.681 | 0.134 | 0.000 |
| 1.821 | 0.006 | 0.000 | −1.018 | −0.025 | 0.000 | −0.587 | 0.118 | 0.000 |
| 1.819 | −0.001 | 0.000 | −1.096 | 0.011 | 0.000 | −0.490 | 0.103 | 0.000 |
| 1.814 | −0.008 | 0.000 | −1.168 | 0.048 | 0.000 | −0.388 | 0.090 | 0.000 |
| 1.805 | −0.013 | 0.000 | −1.234 | 0.083 | 0.000 | −0.286 | 0.079 | 0.000 |
| 1.791 | −0.015 | 0.000 | −1.292 | 0.118 | 0.000 | −0.184 | 0.070 | 0.000 |
| 1.773 | −0.019 | 0.000 | −1.344 | 0.150 | 0.000 | −0.082 | 0.063 | 0.000 |
| 1.750 | −0.023 | 0.000 | −1.389 | 0.180 | 0.000 | 0.021 | 0.057 | 0.000 |
| 1.722 | −0.027 | 0.000 | −1.427 | 0.207 | 0.000 | 0.123 | 0.052 | 0.000 |
| 1.689 | −0.033 | 0.000 | −1.458 | 0.231 | 0.000 | 0.226 | 0.048 | 0.000 |
| 1.651 | −0.040 | 0.000 | −1.484 | 0.253 | 0.000 | 0.328 | 0.045 | 0.000 |
| 1.605 | −0.048 | 0.000 | −1.505 | 0.273 | 0.000 | 0.431 | 0.042 | 0.000 |
| 1.553 | −0.057 | 0.000 | −1.520 | 0.291 | 0.000 | 0.533 | 0.040 | 0.000 |
| 1.493 | −0.067 | 0.000 | −1.532 | 0.305 | 0.000 | 0.636 | 0.039 | 0.000 |
| 1.426 | −0.078 | 0.000 | −1.539 | 0.318 | 0.000 | 0.738 | 0.037 | 0.000 |
| 1.353 | −0.091 | 0.000 | −1.544 | 0.328 | 0.000 | 0.837 | 0.036 | 0.000 |
| 1.272 | −0.104 | 0.000 | −1.546 | 0.337 | 0.000 | 0.933 | 0.034 | 0.000 |
| 1.188 | −0.118 | 0.000 | −1.545 | 0.344 | 0.000 | 1.025 | 0.033 | 0.000 |
| 1.100 | −0.133 | 0.000 | −1.544 | 0.349 | 0.000 | 1.114 | 0.032 | 0.000 |
| 1.009 | −0.148 | 0.000 | −1.540 | 0.353 | 0.000 | 1.200 | 0.031 | 0.000 |
| 0.914 | −0.163 | 0.000 | −1.534 | 0.357 | 0.000 | 1.282 | 0.031 | 0.000 |
| 0.816 | −0.178 | 0.000 | −1.526 | 0.359 | 0.000 | 1.360 | 0.030 | 0.000 |
| 0.714 | −0.193 | 0.000 | −1.516 | 0.361 | 0.000 | 1.432 | 0.030 | 0.000 |
| 0.608 | −0.207 | 0.000 | −1.502 | 0.361 | 0.000 | 1.497 | 0.031 | 0.000 |
| 0.503 | −0.220 | 0.000 | −1.485 | 0.359 | 0.000 | 1.555 | 0.031 | 0.000 |
| 0.397 | −0.231 | 0.000 | −1.463 | 0.355 | 0.000 | 1.607 | 0.031 | 0.000 |
| 0.291 | −0.239 | 0.000 | −1.436 | 0.349 | 0.000 | 1.651 | 0.031 | 0.000 |
| 0.184 | −0.244 | 0.000 | −1.405 | 0.340 | 0.000 | 1.689 | 0.032 | 0.000 |
| 0.078 | −0.247 | 0.000 | −1.369 | 0.329 | 0.000 | 1.721 | 0.032 | 0.000 |
| −0.029 | −0.245 | 0.000 | −1.327 | 0.314 | 0.000 | 1.748 | 0.032 | 0.000 |
| −0.136 | −0.240 | 0.000 | −1.279 | 0.298 | 0.000 | 1.770 | 0.032 | 0.000 |
| −0.243 | −0.231 | 0.000 | −1.224 | 0.279 | 0.000 | 1.788 | 0.033 | 0.000 |
| −0.350 | −0.218 | 0.000 | −1.162 | 0.259 | 0.000 | 1.801 | 0.032 | 0.000 |
| −0.456 | −0.200 | 0.000 | −1.094 | 0.238 | 0.000 | 1.811 | 0.029 | 0.000 |
| −0.562 | −0.178 | 0.000 | −1.019 | 0.215 | 0.000 | 1.817 | 0.023 | 0.000 |
| −0.663 | −0.153 | 0.000 | −0.940 | 0.193 | 0.000 | 1.820 | 0.017 | 0.000 |
| −0.759 | −0.124 | 0.000 | −0.857 | 0.173 | 0.000 | | | |
| −0.850 | −0.093 | 0.000 | −0.771 | 0.153 | 0.000 | | | |
| 1.840 | −0.009 | 0.552 | −0.899 | −0.090 | 0.552 | −0.667 | 0.113 | 0.552 |
| 1.839 | −0.014 | 0.552 | −0.984 | −0.059 | 0.552 | −0.572 | 0.099 | 0.552 |
| 1.837 | −0.021 | 0.552 | −1.064 | −0.027 | 0.552 | −0.474 | 0.085 | 0.552 |
| 1.832 | −0.028 | 0.552 | −1.141 | 0.006 | 0.552 | −0.372 | 0.074 | 0.552 |

TABLE 8R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.823 | −0.033 | 0.552 | −1.210 | 0.037 | 0.552 | −0.269 | 0.064 | 0.552 |
| 1.809 | −0.035 | 0.552 | −1.271 | 0.068 | 0.552 | −0.167 | 0.055 | 0.552 |
| 1.791 | −0.038 | 0.552 | −1.325 | 0.097 | 0.552 | −0.065 | 0.048 | 0.552 |
| 1.768 | −0.042 | 0.552 | −1.372 | 0.123 | 0.552 | 0.038 | 0.042 | 0.552 |
| 1.741 | −0.046 | 0.552 | −1.413 | 0.147 | 0.552 | 0.140 | 0.037 | 0.552 |
| 1.708 | −0.051 | 0.552 | −1.446 | 0.169 | 0.552 | 0.243 | 0.033 | 0.552 |
| 1.670 | −0.057 | 0.552 | −1.474 | 0.189 | 0.552 | 0.345 | 0.030 | 0.552 |
| 1.624 | −0.064 | 0.552 | −1.496 | 0.207 | 0.552 | 0.448 | 0.028 | 0.552 |
| 1.572 | −0.073 | 0.552 | −1.513 | 0.222 | 0.552 | 0.551 | 0.025 | 0.552 |
| 1.513 | −0.082 | 0.552 | −1.526 | 0.236 | 0.552 | 0.653 | 0.023 | 0.552 |
| 1.447 | −0.092 | 0.552 | −1.535 | 0.248 | 0.552 | 0.756 | 0.021 | 0.552 |
| 1.374 | −0.103 | 0.552 | −1.540 | 0.257 | 0.552 | 0.855 | 0.019 | 0.552 |
| 1.294 | −0.115 | 0.552 | −1.543 | 0.266 | 0.552 | 0.951 | 0.017 | 0.552 |
| 1.210 | −0.128 | 0.552 | −1.543 | 0.273 | 0.552 | 1.043 | 0.016 | 0.552 |
| 1.123 | −0.141 | 0.552 | −1.542 | 0.278 | 0.552 | 1.132 | 0.014 | 0.552 |
| 1.033 | −0.155 | 0.552 | −1.539 | 0.282 | 0.552 | 1.218 | 0.013 | 0.552 |
| 0.939 | −0.168 | 0.552 | −1.533 | 0.287 | 0.552 | 1.300 | 0.012 | 0.552 |
| 0.841 | −0.182 | 0.552 | −1.525 | 0.290 | 0.552 | 1.379 | 0.012 | 0.552 |
| 0.740 | −0.195 | 0.552 | −1.515 | 0.292 | 0.552 | 1.451 | 0.011 | 0.552 |
| 0.636 | −0.208 | 0.552 | −1.501 | 0.293 | 0.552 | 1.516 | 0.011 | 0.552 |
| 0.531 | −0.220 | 0.552 | −1.484 | 0.292 | 0.552 | 1.574 | 0.011 | 0.552 |
| 0.427 | −0.230 | 0.552 | −1.461 | 0.290 | 0.552 | 1.625 | 0.011 | 0.552 |
| 0.322 | −0.238 | 0.552 | −1.435 | 0.285 | 0.552 | 1.670 | 0.011 | 0.552 |
| 0.218 | −0.244 | 0.552 | −1.403 | 0.279 | 0.552 | 1.707 | 0.011 | 0.552 |
| 0.113 | −0.247 | 0.552 | −1.367 | 0.270 | 0.552 | 1.739 | 0.011 | 0.552 |
| 0.008 | −0.247 | 0.552 | −1.324 | 0.259 | 0.552 | 1.766 | 0.011 | 0.552 |
| −0.097 | −0.243 | 0.552 | −1.274 | 0.246 | 0.552 | 1.789 | 0.011 | 0.552 |
| −0.202 | −0.236 | 0.552 | −1.218 | 0.231 | 0.552 | 1.807 | 0.012 | 0.552 |
| −0.306 | −0.225 | 0.552 | −1.155 | 0.215 | 0.552 | 1.820 | 0.011 | 0.552 |
| −0.411 | −0.211 | 0.552 | −1.085 | 0.198 | 0.552 | 1.830 | 0.008 | 0.552 |
| −0.516 | −0.192 | 0.552 | −1.008 | 0.180 | 0.552 | 1.836 | 0.002 | 0.552 |
| −0.618 | −0.170 | 0.552 | −0.928 | 0.162 | 0.552 | 1.839 | −0.004 | 0.552 |
| −0.716 | −0.146 | 0.552 | −0.845 | 0.145 | 0.552 | | | |
| −0.810 | −0.119 | 0.552 | −0.757 | 0.129 | 0.552 | | | |
| 1.854 | −0.035 | 0.928 | −0.888 | −0.094 | 0.928 | −0.658 | 0.104 | 0.928 |
| 1.854 | −0.040 | 0.928 | −0.973 | −0.065 | 0.928 | −0.563 | 0.089 | 0.928 |
| 1.852 | −0.047 | 0.928 | −1.054 | −0.035 | 0.928 | −0.464 | 0.076 | 0.928 |
| 1.846 | −0.054 | 0.928 | −1.131 | −0.004 | 0.928 | −0.362 | 0.064 | 0.928 |
| 1.837 | −0.058 | 0.928 | −1.200 | 0.026 | 0.928 | −0.260 | 0.053 | 0.928 |
| 1.823 | −0.060 | 0.928 | −1.262 | 0.055 | 0.928 | −0.157 | 0.043 | 0.928 |
| 1.805 | −0.063 | 0.928 | −1.317 | 0.082 | 0.928 | −0.055 | 0.035 | 0.928 |
| 1.782 | −0.066 | 0.928 | −1.365 | 0.107 | 0.928 | 0.048 | 0.029 | 0.928 |
| 1.755 | −0.070 | 0.928 | −1.406 | 0.130 | 0.928 | 0.151 | 0.023 | 0.928 |
| 1.722 | −0.075 | 0.928 | −1.439 | 0.150 | 0.928 | 0.253 | 0.019 | 0.928 |
| 1.684 | −0.081 | 0.928 | −1.468 | 0.169 | 0.928 | 0.356 | 0.015 | 0.928 |
| 1.638 | −0.087 | 0.928 | −1.490 | 0.186 | 0.928 | 0.459 | 0.011 | 0.928 |
| 1.586 | −0.095 | 0.928 | −1.508 | 0.201 | 0.928 | 0.562 | 0.008 | 0.928 |
| 1.527 | −0.103 | 0.928 | −1.521 | 0.215 | 0.928 | 0.665 | 0.005 | 0.928 |
| 1.461 | −0.113 | 0.928 | −1.531 | 0.226 | 0.928 | 0.768 | 0.002 | 0.928 |
| 1.387 | −0.123 | 0.928 | −1.536 | 0.235 | 0.928 | 0.867 | −0.001 | 0.928 |
| 1.307 | −0.134 | 0.928 | −1.540 | 0.243 | 0.928 | 0.963 | −0.003 | 0.928 |
| 1.223 | −0.146 | 0.928 | −1.540 | 0.250 | 0.928 | 1.056 | −0.005 | 0.928 |
| 1.136 | −0.158 | 0.928 | −1.539 | 0.256 | 0.928 | 1.145 | −0.007 | 0.928 |
| 1.046 | −0.170 | 0.928 | −1.536 | 0.260 | 0.928 | 1.230 | −0.009 | 0.928 |
| 0.951 | −0.183 | 0.928 | −1.531 | 0.264 | 0.928 | 1.313 | −0.010 | 0.928 |
| 0.854 | −0.195 | 0.928 | −1.523 | 0.268 | 0.928 | 1.392 | −0.012 | 0.928 |
| 0.753 | −0.207 | 0.928 | −1.512 | 0.270 | 0.928 | 1.464 | −0.012 | 0.928 |
| 0.648 | −0.218 | 0.928 | −1.499 | 0.271 | 0.928 | 1.529 | −0.013 | 0.928 |
| 0.543 | −0.229 | 0.928 | −1.481 | 0.271 | 0.928 | 1.587 | −0.014 | 0.928 |
| 0.438 | −0.237 | 0.928 | −1.458 | 0.269 | 0.928 | 1.639 | −0.014 | 0.928 |
| 0.334 | −0.245 | 0.928 | −1.432 | 0.265 | 0.928 | 1.683 | −0.014 | 0.928 |
| 0.229 | −0.250 | 0.928 | −1.400 | 0.259 | 0.928 | 1.721 | −0.014 | 0.928 |
| 0.124 | −0.252 | 0.928 | −1.363 | 0.251 | 0.928 | 1.753 | −0.014 | 0.928 |
| 0.019 | −0.251 | 0.928 | −1.320 | 0.241 | 0.928 | 1.780 | −0.014 | 0.928 |
| −0.086 | −0.247 | 0.928 | −1.269 | 0.229 | 0.928 | 1.802 | −0.014 | 0.928 |
| −0.191 | −0.239 | 0.928 | −1.213 | 0.216 | 0.928 | 1.820 | −0.014 | 0.928 |
| −0.296 | −0.228 | 0.928 | −1.149 | 0.201 | 0.928 | 1.834 | −0.015 | 0.928 |
| −0.401 | −0.213 | 0.928 | −1.079 | 0.185 | 0.928 | 1.844 | −0.018 | 0.928 |
| −0.506 | −0.194 | 0.928 | −1.002 | 0.168 | 0.928 | 1.850 | −0.024 | 0.928 |
| −0.608 | −0.173 | 0.928 | −0.921 | 0.151 | 0.928 | 1.853 | −0.030 | 0.928 |
| −0.706 | −0.148 | 0.928 | −0.837 | 0.135 | 0.928 | | | |
| −0.799 | −0.122 | 0.928 | −0.749 | 0.119 | 0.928 | | | |
| 1.876 | −0.115 | 1.680 | −0.873 | −0.088 | 1.680 | −0.644 | 0.092 | 1.680 |
| 1.875 | −0.120 | 1.680 | −0.958 | −0.059 | 1.680 | −0.548 | 0.075 | 1.680 |
| 1.873 | −0.126 | 1.680 | −1.039 | −0.029 | 1.680 | −0.450 | 0.059 | 1.680 |
| 1.867 | −0.133 | 1.680 | −1.115 | 0.002 | 1.680 | −0.347 | 0.044 | 1.680 |
| 1.857 | −0.136 | 1.680 | −1.184 | 0.031 | 1.680 | −0.245 | 0.030 | 1.680 |

TABLE 8R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.843 | −0.138 | 1.680 | −1.247 | 0.059 | 1.680 | −0.142 | 0.017 | 1.680 |
| 1.825 | −0.140 | 1.680 | −1.302 | 0.085 | 1.680 | −0.040 | 0.006 | 1.680 |
| 1.802 | −0.143 | 1.680 | −1.349 | 0.109 | 1.680 | 0.063 | −0.004 | 1.680 |
| 1.774 | −0.146 | 1.680 | −1.391 | 0.131 | 1.680 | 0.166 | −0.013 | 1.680 |
| 1.741 | −0.150 | 1.680 | −1.425 | 0.151 | 1.680 | 0.269 | −0.020 | 1.680 |
| 1.703 | −0.154 | 1.680 | −1.453 | 0.169 | 1.680 | 0.372 | −0.027 | 1.680 |
| 1.657 | −0.159 | 1.680 | −1.477 | 0.185 | 1.680 | 0.475 | −0.034 | 1.680 |
| 1.605 | −0.165 | 1.680 | −1.495 | 0.199 | 1.680 | 0.579 | −0.040 | 1.680 |
| 1.545 | −0.172 | 1.680 | −1.509 | 0.212 | 1.680 | 0.682 | −0.046 | 1.680 |
| 1.479 | −0.179 | 1.680 | −1.518 | 0.223 | 1.680 | 0.785 | −0.052 | 1.680 |
| 1.405 | −0.187 | 1.680 | −1.524 | 0.231 | 1.680 | 0.885 | −0.058 | 1.680 |
| 1.325 | −0.196 | 1.680 | −1.528 | 0.239 | 1.680 | 0.981 | −0.063 | 1.680 |
| 1.240 | −0.205 | 1.680 | −1.530 | 0.247 | 1.680 | 1.074 | −0.067 | 1.680 |
| 1.153 | −0.214 | 1.680 | −1.529 | 0.252 | 1.680 | 1.164 | −0.071 | 1.680 |
| 1.062 | −0.223 | 1.680 | −1.526 | 0.256 | 1.680 | 1.250 | −0.075 | 1.680 |
| 0.967 | −0.232 | 1.680 | −1.520 | 0.260 | 1.680 | 1.332 | −0.079 | 1.680 |
| 0.869 | −0.241 | 1.680 | −1.512 | 0.263 | 1.680 | 1.412 | −0.081 | 1.680 |
| 0.767 | −0.249 | 1.680 | −1.502 | 0.265 | 1.680 | 1.484 | −0.084 | 1.680 |
| 0.662 | −0.257 | 1.680 | −1.488 | 0.266 | 1.680 | 1.549 | −0.086 | 1.680 |
| 0.557 | −0.263 | 1.680 | −1.470 | 0.265 | 1.680 | 1.608 | −0.088 | 1.680 |
| 0.452 | −0.268 | 1.680 | −1.447 | 0.263 | 1.680 | 1.660 | −0.090 | 1.680 |
| 0.347 | −0.271 | 1.680 | −1.420 | 0.259 | 1.680 | 1.704 | −0.091 | 1.680 |
| 0.242 | −0.272 | 1.680 | −1.388 | 0.253 | 1.680 | 1.742 | −0.092 | 1.680 |
| 0.137 | −0.270 | 1.680 | −1.351 | 0.246 | 1.680 | 1.775 | −0.093 | 1.680 |
| 0.031 | −0.266 | 1.680 | −1.308 | 0.235 | 1.680 | 1.802 | −0.093 | 1.680 |
| −0.074 | −0.258 | 1.680 | −1.257 | 0.224 | 1.680 | 1.824 | −0.094 | 1.680 |
| −0.179 | −0.247 | 1.680 | −1.200 | 0.210 | 1.680 | 1.842 | −0.094 | 1.680 |
| −0.284 | −0.233 | 1.680 | −1.137 | 0.195 | 1.680 | 1.856 | −0.095 | 1.680 |
| −0.389 | −0.214 | 1.680 | −1.066 | 0.178 | 1.680 | 1.866 | −0.098 | 1.680 |
| −0.494 | −0.193 | 1.680 | −0.989 | 0.161 | 1.680 | 1.872 | −0.103 | 1.680 |
| −0.595 | −0.169 | 1.680 | −0.908 | 0.144 | 1.680 | 1.875 | −0.110 | 1.680 |
| −0.692 | −0.144 | 1.680 | −0.823 | 0.126 | 1.680 | | | |
| −0.785 | −0.117 | 1.680 | −0.735 | 0.109 | 1.680 | | | |
| 1.887 | −0.222 | 2.432 | −0.866 | −0.070 | 2.432 | −0.635 | 0.086 | 2.432 |
| 1.886 | −0.227 | 2.432 | −0.950 | −0.039 | 2.432 | −0.540 | 0.066 | 2.432 |
| 1.883 | −0.233 | 2.432 | −1.029 | −0.007 | 2.432 | −0.442 | 0.046 | 2.432 |
| 1.877 | −0.239 | 2.432 | −1.105 | 0.025 | 2.432 | −0.340 | 0.027 | 2.432 |
| 1.867 | −0.242 | 2.432 | −1.174 | 0.056 | 2.432 | −0.237 | 0.009 | 2.432 |
| 1.853 | −0.244 | 2.432 | −1.235 | 0.085 | 2.432 | −0.135 | −0.008 | 2.432 |
| 1.834 | −0.245 | 2.432 | −1.290 | 0.112 | 2.432 | −0.032 | −0.024 | 2.432 |
| 1.812 | −0.247 | 2.432 | −1.337 | 0.136 | 2.432 | 0.071 | −0.038 | 2.432 |
| 1.784 | −0.249 | 2.432 | −1.378 | 0.159 | 2.432 | 0.174 | −0.052 | 2.432 |
| 1.751 | −0.252 | 2.432 | −1.412 | 0.179 | 2.432 | 0.277 | −0.065 | 2.432 |
| 1.712 | −0.255 | 2.432 | −1.441 | 0.196 | 2.432 | 0.380 | −0.077 | 2.432 |
| 1.666 | −0.258 | 2.432 | −1.464 | 0.212 | 2.432 | 0.483 | −0.088 | 2.432 |
| 1.613 | −0.262 | 2.432 | −1.483 | 0.227 | 2.432 | 0.586 | −0.099 | 2.432 |
| 1.553 | −0.266 | 2.432 | −1.497 | 0.239 | 2.432 | 0.690 | −0.110 | 2.432 |
| 1.486 | −0.271 | 2.432 | −1.507 | 0.249 | 2.432 | 0.793 | −0.120 | 2.432 |
| 1.412 | −0.275 | 2.432 | −1.513 | 0.258 | 2.432 | 0.893 | −0.130 | 2.432 |
| 1.331 | −0.280 | 2.432 | −1.518 | 0.265 | 2.432 | 0.989 | −0.139 | 2.432 |
| 1.246 | −0.285 | 2.432 | −1.519 | 0.272 | 2.432 | 1.083 | −0.147 | 2.432 |
| 1.158 | −0.290 | 2.432 | −1.518 | 0.278 | 2.432 | 1.172 | −0.155 | 2.432 |
| 1.067 | −0.295 | 2.432 | −1.515 | 0.282 | 2.432 | 1.259 | −0.162 | 2.432 |
| 0.971 | −0.299 | 2.432 | −1.509 | 0.285 | 2.432 | 1.341 | −0.168 | 2.432 |
| 0.873 | −0.303 | 2.432 | −1.501 | 0.288 | 2.432 | 1.421 | −0.174 | 2.432 |
| 0.771 | −0.306 | 2.432 | −1.490 | 0.289 | 2.432 | 1.493 | −0.179 | 2.432 |
| 0.665 | −0.308 | 2.432 | −1.476 | 0.289 | 2.432 | 1.559 | −0.183 | 2.432 |
| 0.559 | −0.308 | 2.432 | −1.458 | 0.287 | 2.432 | 1.618 | −0.187 | 2.432 |
| 0.454 | −0.307 | 2.432 | −1.436 | 0.284 | 2.432 | 1.670 | −0.190 | 2.432 |
| 0.349 | −0.305 | 2.432 | −1.409 | 0.279 | 2.432 | 1.715 | −0.193 | 2.432 |
| 0.243 | −0.300 | 2.432 | −1.378 | 0.272 | 2.432 | 1.753 | −0.195 | 2.432 |
| 0.138 | −0.292 | 2.432 | −1.341 | 0.262 | 2.432 | 1.785 | −0.197 | 2.432 |
| 0.033 | −0.282 | 2.432 | −1.297 | 0.251 | 2.432 | 1.812 | −0.198 | 2.432 |
| −0.072 | −0.269 | 2.432 | −1.247 | 0.237 | 2.432 | 1.835 | −0.199 | 2.432 |
| −0.177 | −0.253 | 2.432 | −1.190 | 0.222 | 2.432 | 1.853 | −0.200 | 2.432 |
| −0.281 | −0.234 | 2.432 | −1.127 | 0.205 | 2.432 | 1.867 | −0.201 | 2.432 |
| −0.386 | −0.212 | 2.432 | −1.056 | 0.186 | 2.432 | 1.877 | −0.204 | 2.432 |
| −0.490 | −0.186 | 2.432 | −0.979 | 0.166 | 2.432 | 1.883 | −0.210 | 2.432 |
| −0.590 | −0.159 | 2.432 | −0.898 | 0.146 | 2.432 | 1.886 | −0.216 | 2.432 |
| −0.686 | −0.131 | 2.432 | −0.814 | 0.126 | 2.432 | | | |
| −0.778 | −0.101 | 2.432 | −0.726 | 0.106 | 2.432 | | | |
| 1.892 | −0.334 | 3.184 | −0.858 | −0.051 | 3.184 | −0.626 | 0.080 | 3.184 |
| 1.891 | −0.340 | 3.184 | −0.940 | −0.018 | 3.184 | −0.531 | 0.057 | 3.184 |
| 1.888 | −0.346 | 3.184 | −1.019 | 0.016 | 3.184 | −0.433 | 0.033 | 3.184 |
| 1.882 | −0.352 | 3.184 | −1.094 | 0.050 | 3.184 | −0.331 | 0.010 | 3.184 |
| 1.872 | −0.355 | 3.184 | −1.162 | 0.082 | 3.184 | −0.230 | −0.012 | 3.184 |
| 1.857 | −0.355 | 3.184 | −1.223 | 0.112 | 3.184 | −0.127 | −0.033 | 3.184 |

TABLE 8R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.839 | −0.356 | 3.184 | −1.277 | 0.140 | 3.184 | −0.025 | −0.053 | 3.184 |
| 1.816 | −0.357 | 3.184 | −1.324 | 0.165 | 3.184 | 0.077 | −0.072 | 3.184 |
| 1.788 | −0.358 | 3.184 | −1.365 | 0.188 | 3.184 | 0.180 | −0.091 | 3.184 |
| 1.755 | −0.359 | 3.184 | −1.399 | 0.208 | 3.184 | 0.283 | −0.109 | 3.184 |
| 1.716 | −0.360 | 3.184 | −1.427 | 0.226 | 3.184 | 0.386 | −0.126 | 3.184 |
| 1.670 | −0.362 | 3.184 | −1.451 | 0.242 | 3.184 | 0.489 | −0.143 | 3.184 |
| 1.617 | −0.363 | 3.184 | −1.469 | 0.256 | 3.184 | 0.592 | −0.159 | 3.184 |
| 1.556 | −0.365 | 3.184 | −1.483 | 0.268 | 3.184 | 0.695 | −0.174 | 3.184 |
| 1.489 | −0.366 | 3.184 | −1.493 | 0.278 | 3.184 | 0.799 | −0.189 | 3.184 |
| 1.415 | −0.367 | 3.184 | −1.500 | 0.287 | 3.184 | 0.898 | −0.204 | 3.184 |
| 1.333 | −0.368 | 3.184 | −1.505 | 0.294 | 3.184 | 0.995 | −0.217 | 3.184 |
| 1.248 | −0.369 | 3.184 | −1.507 | 0.301 | 3.184 | 1.088 | −0.229 | 3.184 |
| 1.159 | −0.369 | 3.184 | −1.506 | 0.306 | 3.184 | 1.178 | −0.241 | 3.184 |
| 1.067 | −0.369 | 3.184 | −1.502 | 0.310 | 3.184 | 1.264 | −0.252 | 3.184 |
| 0.972 | −0.368 | 3.184 | −1.496 | 0.314 | 3.184 | 1.347 | −0.262 | 3.184 |
| 0.873 | −0.367 | 3.184 | −1.487 | 0.315 | 3.184 | 1.426 | −0.271 | 3.184 |
| 0.771 | −0.364 | 3.184 | −1.477 | 0.316 | 3.184 | 1.499 | −0.278 | 3.184 |
| 0.665 | −0.360 | 3.184 | −1.463 | 0.315 | 3.184 | 1.565 | −0.285 | 3.184 |
| 0.559 | −0.354 | 3.184 | −1.445 | 0.312 | 3.184 | 1.624 | −0.291 | 3.184 |
| 0.454 | −0.347 | 3.184 | −1.423 | 0.308 | 3.184 | 1.676 | −0.296 | 3.184 |
| 0.348 | −0.338 | 3.184 | −1.396 | 0.302 | 3.184 | 1.721 | −0.300 | 3.184 |
| 0.243 | −0.327 | 3.184 | −1.365 | 0.293 | 3.184 | 1.759 | −0.304 | 3.184 |
| 0.138 | −0.314 | 3.184 | −1.328 | 0.282 | 3.184 | 1.791 | −0.307 | 3.184 |
| 0.033 | −0.298 | 3.184 | −1.285 | 0.269 | 3.184 | 1.819 | −0.309 | 3.184 |
| −0.071 | −0.279 | 3.184 | −1.235 | 0.253 | 3.184 | 1.841 | −0.311 | 3.184 |
| −0.175 | −0.259 | 3.184 | −1.178 | 0.236 | 3.184 | 1.859 | −0.312 | 3.184 |
| −0.279 | −0.235 | 3.184 | −1.115 | 0.217 | 3.184 | 1.873 | −0.313 | 3.184 |
| −0.383 | −0.209 | 3.184 | −1.045 | 0.195 | 3.184 | 1.883 | −0.317 | 3.184 |
| −0.486 | −0.179 | 3.184 | −0.968 | 0.173 | 3.184 | 1.889 | −0.323 | 3.184 |
| −0.585 | −0.149 | 3.184 | −0.888 | 0.150 | 3.184 | 1.892 | −0.329 | 3.184 |
| −0.680 | −0.117 | 3.184 | −0.804 | 0.127 | 3.184 | | | |
| −0.771 | −0.085 | 3.184 | −0.717 | 0.103 | 3.184 | | | |
| 1.899 | −0.442 | 3.936 | −0.845 | −0.040 | 3.936 | −0.614 | 0.070 | 3.936 |
| 1.898 | −0.447 | 3.936 | −0.927 | −0.004 | 3.936 | −0.519 | 0.043 | 3.936 |
| 1.895 | −0.453 | 3.936 | −1.005 | 0.031 | 3.936 | −0.422 | 0.017 | 3.936 |
| 1.888 | −0.459 | 3.936 | −1.080 | 0.066 | 3.936 | −0.320 | −0.010 | 3.936 |
| 1.877 | −0.461 | 3.936 | −1.147 | 0.099 | 3.936 | −0.219 | −0.035 | 3.936 |
| 1.863 | −0.461 | 3.936 | −1.208 | 0.130 | 3.936 | −0.117 | −0.060 | 3.936 |
| 1.845 | −0.461 | 3.936 | −1.261 | 0.159 | 3.936 | −0.015 | −0.084 | 3.936 |
| 1.822 | −0.461 | 3.936 | −1.308 | 0.185 | 3.936 | 0.087 | −0.108 | 3.936 |
| 1.793 | −0.461 | 3.936 | −1.349 | 0.208 | 3.936 | 0.190 | −0.130 | 3.936 |
| 1.760 | −0.461 | 3.936 | −1.383 | 0.228 | 3.936 | 0.292 | −0.152 | 3.936 |
| 1.721 | −0.460 | 3.936 | −1.411 | 0.246 | 3.936 | 0.395 | −0.173 | 3.936 |
| 1.675 | −0.460 | 3.936 | −1.435 | 0.261 | 3.936 | 0.497 | −0.194 | 3.936 |
| 1.621 | −0.459 | 3.936 | −1.453 | 0.275 | 3.936 | 0.600 | −0.215 | 3.936 |
| 1.561 | −0.458 | 3.936 | −1.467 | 0.288 | 3.936 | 0.703 | −0.235 | 3.936 |
| 1.494 | −0.456 | 3.936 | −1.477 | 0.298 | 3.936 | 0.806 | −0.254 | 3.936 |
| 1.419 | −0.454 | 3.936 | −1.484 | 0.306 | 3.936 | 0.906 | −0.273 | 3.936 |
| 1.337 | −0.451 | 3.936 | −1.488 | 0.314 | 3.936 | 1.002 | −0.290 | 3.936 |
| 1.252 | −0.447 | 3.936 | −1.490 | 0.321 | 3.936 | 1.095 | −0.307 | 3.936 |
| 1.163 | −0.443 | 3.936 | −1.489 | 0.326 | 3.936 | 1.184 | −0.322 | 3.936 |
| 1.071 | −0.438 | 3.936 | −1.486 | 0.330 | 3.936 | 1.271 | −0.337 | 3.936 |
| 0.976 | −0.432 | 3.936 | −1.479 | 0.333 | 3.936 | 1.353 | −0.350 | 3.936 |
| 0.877 | −0.425 | 3.936 | −1.471 | 0.334 | 3.936 | 1.433 | −0.362 | 3.936 |
| 0.774 | −0.417 | 3.936 | −1.460 | 0.334 | 3.936 | 1.505 | −0.372 | 3.936 |
| 0.669 | −0.407 | 3.936 | −1.446 | 0.333 | 3.936 | 1.571 | −0.381 | 3.936 |
| 0.563 | −0.396 | 3.936 | −1.428 | 0.330 | 3.936 | 1.630 | −0.389 | 3.936 |
| 0.458 | −0.383 | 3.936 | −1.406 | 0.324 | 3.936 | 1.682 | −0.396 | 3.936 |
| 0.353 | −0.369 | 3.936 | −1.380 | 0.317 | 3.936 | 1.727 | −0.402 | 3.936 |
| 0.248 | −0.353 | 3.936 | −1.349 | 0.306 | 3.936 | 1.765 | −0.407 | 3.936 |
| 0.143 | −0.335 | 3.936 | −1.312 | 0.294 | 3.936 | 1.798 | −0.411 | 3.936 |
| 0.039 | −0.314 | 3.936 | −1.269 | 0.279 | 3.936 | 1.825 | −0.414 | 3.936 |
| −0.065 | −0.292 | 3.936 | −1.220 | 0.262 | 3.936 | 1.848 | −0.417 | 3.936 |
| −0.168 | −0.267 | 3.936 | −1.163 | 0.243 | 3.936 | 1.866 | −0.419 | 3.936 |
| −0.272 | −0.239 | 3.936 | −1.100 | 0.222 | 3.936 | 1.880 | −0.421 | 3.936 |
| −0.374 | −0.209 | 3.936 | −1.031 | 0.198 | 3.936 | 1.890 | −0.424 | 3.936 |
| −0.477 | −0.177 | 3.936 | −0.954 | 0.173 | 3.936 | 1.896 | −0.430 | 3.936 |
| −0.575 | −0.144 | 3.936 | −0.875 | 0.148 | 3.936 | 1.898 | −0.437 | 3.936 |
| −0.669 | −0.109 | 3.936 | −0.791 | 0.122 | 3.936 | | | |
| −0.759 | −0.075 | 3.936 | −0.704 | 0.096 | 3.936 | | | |
| 1.909 | −0.536 | 4.688 | −0.829 | −0.037 | 4.688 | −0.600 | 0.052 | 4.688 |
| 1.907 | −0.541 | 4.688 | −0.911 | −0.001 | 4.688 | −0.506 | 0.023 | 4.688 |
| 1.904 | −0.547 | 4.688 | −0.989 | 0.036 | 4.688 | −0.408 | −0.006 | 4.688 |
| 1.897 | −0.553 | 4.688 | −1.063 | 0.072 | 4.688 | −0.307 | −0.036 | 4.688 |
| 1.886 | −0.554 | 4.688 | −1.130 | 0.106 | 4.688 | −0.206 | −0.064 | 4.688 |
| 1.872 | −0.554 | 4.688 | −1.190 | 0.137 | 4.688 | −0.104 | −0.091 | 4.688 |
| 1.853 | −0.553 | 4.688 | −1.244 | 0.166 | 4.688 | −0.002 | −0.118 | 4.688 |

TABLE 8R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.830 | −0.552 | 4.688 | −1.291 | 0.192 | 4.688 | 0.100 | −0.145 | 4.688 |
| 1.802 | −0.550 | 4.688 | −1.331 | 0.215 | 4.688 | 0.202 | −0.170 | 4.688 |
| 1.769 | −0.549 | 4.688 | −1.365 | 0.235 | 4.688 | 0.304 | −0.195 | 4.688 |
| 1.730 | −0.547 | 4.688 | −1.394 | 0.253 | 4.688 | 0.407 | −0.219 | 4.688 |
| 1.683 | −0.544 | 4.688 | −1.417 | 0.269 | 4.688 | 0.509 | −0.243 | 4.688 |
| 1.630 | −0.541 | 4.688 | −1.436 | 0.283 | 4.688 | 0.612 | −0.267 | 4.688 |
| 1.570 | −0.537 | 4.688 | −1.450 | 0.295 | 4.688 | 0.715 | −0.290 | 4.688 |
| 1.502 | −0.533 | 4.688 | −1.460 | 0.305 | 4.688 | 0.818 | −0.313 | 4.688 |
| 1.428 | −0.527 | 4.688 | −1.467 | 0.313 | 4.688 | 0.917 | −0.334 | 4.688 |
| 1.346 | −0.521 | 4.688 | −1.472 | 0.321 | 4.688 | 1.013 | −0.355 | 4.688 |
| 1.261 | −0.514 | 4.688 | −1.474 | 0.328 | 4.688 | 1.106 | −0.375 | 4.688 |
| 1.172 | −0.506 | 4.688 | −1.473 | 0.333 | 4.688 | 1.195 | −0.393 | 4.688 |
| 1.080 | −0.497 | 4.688 | −1.469 | 0.337 | 4.688 | 1.281 | −0.410 | 4.688 |
| 0.985 | −0.487 | 4.688 | −1.462 | 0.339 | 4.688 | 1.364 | −0.426 | 4.688 |
| 0.886 | −0.476 | 4.688 | −1.454 | 0.340 | 4.688 | 1.444 | −0.441 | 4.688 |
| 0.783 | −0.463 | 4.688 | −1.443 | 0.340 | 4.688 | 1.516 | −0.453 | 4.688 |
| 0.678 | −0.449 | 4.688 | −1.429 | 0.338 | 4.688 | 1.582 | −0.465 | 4.688 |
| 0.573 | −0.434 | 4.688 | −1.411 | 0.334 | 4.688 | 1.641 | −0.475 | 4.688 |
| 0.467 | −0.417 | 4.688 | −1.389 | 0.328 | 4.688 | 1.693 | −0.483 | 4.688 |
| 0.363 | −0.398 | 4.688 | −1.363 | 0.320 | 4.688 | 1.738 | −0.491 | 4.688 |
| 0.258 | −0.378 | 4.688 | −1.332 | 0.309 | 4.688 | 1.776 | −0.497 | 4.688 |
| 0.154 | −0.357 | 4.688 | −1.296 | 0.295 | 4.688 | 1.809 | −0.502 | 4.688 |
| 0.050 | −0.333 | 4.688 | −1.253 | 0.279 | 4.688 | 1.836 | −0.506 | 4.688 |
| −0.054 | −0.307 | 4.688 | −1.203 | 0.261 | 4.688 | 1.859 | −0.509 | 4.688 |
| −0.157 | −0.279 | 4.688 | −1.147 | 0.240 | 4.688 | 1.877 | −0.512 | 4.688 |
| −0.259 | −0.249 | 4.688 | −1.085 | 0.217 | 4.688 | 1.891 | −0.514 | 4.688 |
| −0.362 | −0.216 | 4.688 | −1.015 | 0.192 | 4.688 | 1.900 | −0.518 | 4.688 |
| −0.463 | −0.181 | 4.688 | −0.939 | 0.165 | 4.688 | 1.906 | −0.524 | 4.688 |
| −0.561 | −0.146 | 4.688 | −0.860 | 0.138 | 4.688 | 1.908 | −0.531 | 4.688 |
| −0.654 | −0.110 | 4.688 | −0.776 | 0.109 | 4.688 | | | |
| −0.744 | −0.074 | 4.688 | −0.690 | 0.081 | 4.688 | | | |
| 1.920 | −0.663 | 5.816 | −0.809 | −0.039 | 5.816 | −0.582 | 0.020 | 5.816 |
| 1.919 | −0.668 | 5.816 | −0.890 | −0.001 | 5.816 | −0.489 | −0.013 | 5.816 |
| 1.915 | −0.674 | 5.816 | −0.967 | 0.037 | 5.816 | −0.392 | −0.046 | 5.816 |
| 1.907 | −0.679 | 5.816 | −1.041 | 0.074 | 5.816 | −0.291 | −0.079 | 5.816 |
| 1.896 | −0.679 | 5.816 | −1.107 | 0.110 | 5.816 | −0.190 | −0.111 | 5.816 |
| 1.882 | −0.678 | 5.816 | −1.167 | 0.142 | 5.816 | −0.089 | −0.142 | 5.816 |
| 1.864 | −0.676 | 5.816 | −1.220 | 0.172 | 5.816 | 0.013 | −0.173 | 5.816 |
| 1.841 | −0.673 | 5.816 | −1.267 | 0.199 | 5.816 | 0.115 | −0.203 | 5.816 |
| 1.813 | −0.670 | 5.816 | −1.307 | 0.222 | 5.816 | 0.217 | −0.232 | 5.816 |
| 1.779 | −0.666 | 5.816 | −1.341 | 0.243 | 5.816 | 0.319 | −0.260 | 5.816 |
| 1.740 | −0.661 | 5.816 | −1.369 | 0.261 | 5.816 | 0.421 | −0.288 | 5.816 |
| 1.694 | −0.656 | 5.816 | −1.393 | 0.276 | 5.816 | 0.524 | −0.315 | 5.816 |
| 1.641 | −0.649 | 5.816 | −1.412 | 0.290 | 5.816 | 0.626 | −0.342 | 5.816 |
| 1.580 | −0.642 | 5.816 | −1.426 | 0.302 | 5.816 | 0.729 | −0.368 | 5.816 |
| 1.513 | −0.633 | 5.816 | −1.437 | 0.312 | 5.816 | 0.832 | −0.394 | 5.816 |
| 1.439 | −0.624 | 5.816 | −1.444 | 0.320 | 5.816 | 0.931 | −0.420 | 5.816 |
| 1.357 | −0.613 | 5.816 | −1.448 | 0.328 | 5.816 | 1.027 | −0.443 | 5.816 |
| 1.272 | −0.601 | 5.816 | −1.451 | 0.335 | 5.816 | 1.120 | −0.466 | 5.816 |
| 1.184 | −0.588 | 5.816 | −1.450 | 0.340 | 5.816 | 1.209 | −0.488 | 5.816 |
| 1.092 | −0.574 | 5.816 | −1.446 | 0.343 | 5.816 | 1.295 | −0.508 | 5.816 |
| 0.996 | −0.559 | 5.816 | −1.439 | 0.345 | 5.816 | 1.378 | −0.527 | 5.816 |
| 0.898 | −0.543 | 5.816 | −1.430 | 0.346 | 5.816 | 1.457 | −0.545 | 5.816 |
| 0.796 | −0.526 | 5.816 | −1.420 | 0.344 | 5.816 | 1.530 | −0.562 | 5.816 |
| 0.690 | −0.506 | 5.816 | −1.406 | 0.342 | 5.816 | 1.595 | −0.576 | 5.816 |
| 0.585 | −0.486 | 5.816 | −1.388 | 0.337 | 5.816 | 1.654 | −0.589 | 5.816 |
| 0.481 | −0.465 | 5.816 | −1.366 | 0.329 | 5.816 | 1.706 | −0.600 | 5.816 |
| 0.376 | −0.442 | 5.816 | −1.340 | 0.319 | 5.816 | 1.751 | −0.609 | 5.816 |
| 0.272 | −0.417 | 5.816 | −1.310 | 0.306 | 5.816 | 1.789 | −0.617 | 5.816 |
| 0.168 | −0.391 | 5.816 | −1.274 | 0.291 | 5.816 | 1.822 | −0.624 | 5.816 |
| 0.064 | −0.363 | 5.816 | −1.231 | 0.274 | 5.816 | 1.849 | −0.629 | 5.816 |
| −0.039 | −0.333 | 5.816 | −1.182 | 0.253 | 5.816 | 1.871 | −0.634 | 5.816 |
| −0.142 | −0.301 | 5.816 | −1.127 | 0.230 | 5.816 | 1.889 | −0.637 | 5.816 |
| −0.244 | −0.267 | 5.816 | −1.065 | 0.204 | 5.816 | 1.903 | −0.640 | 5.816 |
| −0.345 | −0.231 | 5.816 | −0.996 | 0.177 | 5.816 | 1.913 | −0.644 | 5.816 |
| −0.446 | −0.193 | 5.816 | −0.920 | 0.147 | 5.816 | 1.918 | −0.651 | 5.816 |
| −0.542 | −0.155 | 5.816 | −0.841 | 0.116 | 5.816 | 1.920 | −0.658 | 5.816 |
| −0.635 | −0.116 | 5.816 | −0.758 | 0.084 | 5.816 | | | |
| −0.724 | −0.078 | 5.816 | −0.672 | 0.053 | 5.816 | | | |
| 1.907 | −0.765 | 6.568 | −0.801 | −0.009 | 6.568 | −0.579 | 0.017 | 6.568 |
| 1.905 | −0.770 | 6.568 | −0.880 | 0.035 | 6.568 | −0.488 | −0.022 | 6.568 |
| 1.901 | −0.776 | 6.568 | −0.954 | 0.079 | 6.568 | −0.393 | −0.061 | 6.568 |
| 1.893 | −0.780 | 6.568 | −1.026 | 0.121 | 6.568 | −0.294 | −0.100 | 6.568 |
| 1.883 | −0.781 | 6.568 | −1.090 | 0.161 | 6.568 | −0.194 | −0.138 | 6.568 |
| 1.869 | −0.779 | 6.568 | −1.147 | 0.199 | 6.568 | −0.094 | −0.175 | 6.568 |
| 1.850 | −0.776 | 6.568 | −1.199 | 0.232 | 6.568 | 0.006 | −0.211 | 6.568 |
| 1.827 | −0.772 | 6.568 | −1.243 | 0.263 | 6.568 | 0.107 | −0.245 | 6.568 |

TABLE 8R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.799 | −0.768 | 6.568 | −1.282 | 0.290 | 6.568 | 0.208 | −0.279 | 6.568 |
| 1.765 | −0.763 | 6.568 | −1.314 | 0.313 | 6.568 | 0.310 | −0.311 | 6.568 |
| 1.726 | −0.757 | 6.568 | −1.342 | 0.333 | 6.568 | 0.412 | −0.343 | 6.568 |
| 1.680 | −0.750 | 6.568 | −1.364 | 0.350 | 6.568 | 0.514 | −0.374 | 6.568 |
| 1.627 | −0.741 | 6.568 | −1.382 | 0.365 | 6.568 | 0.616 | −0.405 | 6.568 |
| 1.567 | −0.731 | 6.568 | −1.396 | 0.378 | 6.568 | 0.718 | −0.435 | 6.568 |
| 1.499 | −0.720 | 6.568 | −1.406 | 0.388 | 6.568 | 0.820 | −0.464 | 6.568 |
| 1.425 | −0.708 | 6.568 | −1.413 | 0.397 | 6.568 | 0.920 | −0.493 | 6.568 |
| 1.343 | −0.694 | 6.568 | −1.417 | 0.405 | 6.568 | 1.015 | −0.519 | 6.568 |
| 1.258 | −0.679 | 6.568 | −1.419 | 0.411 | 6.568 | 1.108 | −0.545 | 6.568 |
| 1.170 | −0.663 | 6.568 | −1.418 | 0.417 | 6.568 | 1.197 | −0.569 | 6.568 |
| 1.078 | −0.645 | 6.568 | −1.414 | 0.420 | 6.568 | 1.283 | −0.592 | 6.568 |
| 0.983 | −0.627 | 6.568 | −1.407 | 0.420 | 6.568 | 1.365 | −0.614 | 6.568 |
| 0.885 | −0.606 | 6.568 | −1.398 | 0.419 | 6.568 | 1.444 | −0.634 | 6.568 |
| 0.783 | −0.584 | 6.568 | −1.388 | 0.417 | 6.568 | 1.517 | −0.653 | 6.568 |
| 0.678 | −0.560 | 6.568 | −1.374 | 0.412 | 6.568 | 1.582 | −0.669 | 6.568 |
| 0.573 | −0.535 | 6.568 | −1.357 | 0.405 | 6.568 | 1.641 | −0.683 | 6.568 |
| 0.469 | −0.509 | 6.568 | −1.336 | 0.395 | 6.568 | 1.693 | −0.696 | 6.568 |
| 0.365 | −0.481 | 6.568 | −1.311 | 0.382 | 6.568 | 1.738 | −0.706 | 6.568 |
| 0.262 | −0.451 | 6.568 | −1.282 | 0.366 | 6.568 | 1.776 | −0.715 | 6.568 |
| 0.159 | −0.420 | 6.568 | −1.248 | 0.347 | 6.568 | 1.809 | −0.723 | 6.568 |
| 0.056 | −0.386 | 6.568 | −1.207 | 0.325 | 6.568 | 1.836 | −0.729 | 6.568 |
| −0.046 | −0.350 | 6.568 | −1.160 | 0.300 | 6.568 | 1.858 | −0.734 | 6.568 |
| −0.147 | −0.313 | 6.568 | −1.107 | 0.272 | 6.568 | 1.876 | −0.738 | 6.568 |
| −0.248 | −0.273 | 6.568 | −1.047 | 0.240 | 6.568 | 1.890 | −0.741 | 6.568 |
| −0.348 | −0.231 | 6.568 | −0.981 | 0.206 | 6.568 | 1.900 | −0.746 | 6.568 |
| −0.446 | −0.187 | 6.568 | −0.907 | 0.170 | 6.568 | 1.906 | −0.753 | 6.568 |
| −0.541 | −0.142 | 6.568 | −0.831 | 0.132 | 6.568 | 1.907 | −0.760 | 6.568 |
| −0.632 | −0.098 | 6.568 | −0.751 | 0.094 | 6.568 | | | |
| −0.718 | −0.053 | 6.568 | −0.667 | 0.056 | 6.568 | | | |
| 1.890 | −0.831 | 6.944 | −0.796 | 0.025 | 6.944 | −0.578 | 0.031 | 6.944 |
| 1.888 | −0.836 | 6.944 | −0.872 | 0.074 | 6.944 | −0.489 | −0.014 | 6.944 |
| 1.884 | −0.842 | 6.944 | −0.945 | 0.121 | 6.944 | −0.396 | −0.058 | 6.944 |
| 1.876 | −0.846 | 6.944 | −1.014 | 0.168 | 6.944 | −0.299 | −0.103 | 6.944 |
| 1.865 | −0.846 | 6.944 | −1.077 | 0.211 | 6.944 | −0.201 | −0.146 | 6.944 |
| 1.851 | −0.844 | 6.944 | −1.133 | 0.251 | 6.944 | −0.102 | −0.187 | 6.944 |
| 1.832 | −0.841 | 6.944 | −1.183 | 0.288 | 6.944 | −0.003 | −0.227 | 6.944 |
| 1.809 | −0.837 | 6.944 | −1.226 | 0.320 | 6.944 | 0.097 | −0.266 | 6.944 |
| 1.781 | −0.832 | 6.944 | −1.263 | 0.349 | 6.944 | 0.197 | −0.303 | 6.944 |
| 1.748 | −0.826 | 6.944 | −1.295 | 0.373 | 6.944 | 0.298 | −0.340 | 6.944 |
| 1.709 | −0.819 | 6.944 | −1.321 | 0.395 | 6.944 | 0.399 | −0.375 | 6.944 |
| 1.662 | −0.811 | 6.944 | −1.343 | 0.413 | 6.944 | 0.500 | −0.409 | 6.944 |
| 1.609 | −0.801 | 6.944 | −1.361 | 0.429 | 6.944 | 0.602 | −0.442 | 6.944 |
| 1.549 | −0.790 | 6.944 | −1.374 | 0.442 | 6.944 | 0.704 | −0.475 | 6.944 |
| 1.481 | −0.777 | 6.944 | −1.384 | 0.453 | 6.944 | 0.806 | −0.508 | 6.944 |
| 1.407 | −0.763 | 6.944 | −1.390 | 0.462 | 6.944 | 0.905 | −0.538 | 6.944 |
| 1.326 | −0.747 | 6.944 | −1.394 | 0.470 | 6.944 | 1.000 | −0.567 | 6.944 |
| 1.241 | −0.730 | 6.944 | −1.396 | 0.477 | 6.944 | 1.093 | −0.595 | 6.944 |
| 1.152 | −0.711 | 6.944 | −1.395 | 0.482 | 6.944 | 1.182 | −0.621 | 6.944 |
| 1.061 | −0.691 | 6.944 | −1.391 | 0.485 | 6.944 | 1.267 | −0.646 | 6.944 |
| 0.966 | −0.670 | 6.944 | −1.383 | 0.485 | 6.944 | 1.349 | −0.670 | 6.944 |
| 0.868 | −0.647 | 6.944 | −1.375 | 0.483 | 6.944 | 1.428 | −0.692 | 6.944 |
| 0.766 | −0.622 | 6.944 | −1.365 | 0.479 | 6.944 | 1.501 | −0.712 | 6.944 |
| 0.662 | −0.595 | 6.944 | −1.351 | 0.474 | 6.944 | 1.566 | −0.729 | 6.944 |
| 0.558 | −0.566 | 6.944 | −1.335 | 0.465 | 6.944 | 1.625 | −0.745 | 6.944 |
| 0.454 | −0.536 | 6.944 | −1.315 | 0.454 | 6.944 | 1.677 | −0.758 | 6.944 |
| 0.351 | −0.504 | 6.944 | −1.291 | 0.439 | 6.944 | 1.722 | −0.770 | 6.944 |
| 0.248 | −0.470 | 6.944 | −1.262 | 0.421 | 6.944 | 1.760 | −0.779 | 6.944 |
| 0.146 | −0.434 | 6.944 | −1.229 | 0.400 | 6.944 | 1.792 | −0.787 | 6.944 |
| 0.045 | −0.396 | 6.944 | −1.190 | 0.376 | 6.944 | 1.820 | −0.794 | 6.944 |
| −0.056 | −0.356 | 6.944 | −1.144 | 0.348 | 6.944 | 1.842 | −0.799 | 6.944 |
| −0.156 | −0.313 | 6.944 | −1.092 | 0.316 | 6.944 | 1.860 | −0.804 | 6.944 |
| −0.255 | −0.268 | 6.944 | −1.034 | 0.281 | 6.944 | 1.874 | −0.807 | 6.944 |
| −0.353 | −0.221 | 6.944 | −0.970 | 0.243 | 6.944 | 1.883 | −0.812 | 6.944 |
| −0.450 | −0.172 | 6.944 | −0.899 | 0.202 | 6.944 | 1.889 | −0.819 | 6.944 |
| −0.542 | −0.122 | 6.944 | −0.824 | 0.160 | 6.944 | 1.890 | −0.826 | 6.944 |
| −0.631 | −0.073 | 6.944 | −0.746 | 0.118 | 6.944 | | | |
| −0.715 | −0.023 | 6.944 | −0.664 | 0.074 | 6.944 | | | |

The coordinate values given in TABLE 9R below provide the nominal profile envelope for an exemplary ninth stage rotor.

TABLE 9R

| X-LOC | Y-LOC | Z-LOC | X-LOC | Y-LOC | Z-LOC | X-LOC | Y-LOC | Z-LOC |
|---|---|---|---|---|---|---|---|---|
| 1.765 | 0.002 | 0.000 | −0.963 | −0.090 | 0.000 | −0.695 | 0.121 | 0.000 |
| 1.765 | −0.004 | 0.000 | −1.044 | −0.056 | 0.000 | −0.601 | 0.108 | 0.000 |
| 1.764 | −0.011 | 0.000 | −1.120 | −0.020 | 0.000 | −0.504 | 0.097 | 0.000 |
| 1.762 | −0.019 | 0.000 | −1.191 | 0.017 | 0.000 | −0.403 | 0.087 | 0.000 |
| 1.756 | −0.028 | 0.000 | −1.258 | 0.057 | 0.000 | −0.303 | 0.078 | 0.000 |
| 1.746 | −0.037 | 0.000 | −1.317 | 0.095 | 0.000 | −0.202 | 0.069 | 0.000 |
| 1.728 | −0.043 | 0.000 | −1.369 | 0.131 | 0.000 | −0.101 | 0.062 | 0.000 |
| 1.706 | −0.046 | 0.000 | −1.415 | 0.166 | 0.000 | 0.000 | 0.056 | 0.000 |
| 1.678 | −0.051 | 0.000 | −1.456 | 0.200 | 0.000 | 0.101 | 0.050 | 0.000 |
| 1.645 | −0.056 | 0.000 | −1.491 | 0.230 | 0.000 | 0.202 | 0.044 | 0.000 |
| 1.607 | −0.063 | 0.000 | −1.516 | 0.256 | 0.000 | 0.302 | 0.039 | 0.000 |
| 1.562 | −0.070 | 0.000 | −1.533 | 0.278 | 0.000 | 0.403 | 0.035 | 0.000 |
| 1.509 | −0.079 | 0.000 | −1.544 | 0.296 | 0.000 | 0.504 | 0.031 | 0.000 |
| 1.450 | −0.088 | 0.000 | −1.550 | 0.312 | 0.000 | 0.605 | 0.028 | 0.000 |
| 1.384 | −0.099 | 0.000 | −1.550 | 0.320 | 0.000 | 0.706 | 0.026 | 0.000 |
| 1.311 | −0.111 | 0.000 | −1.549 | 0.326 | 0.000 | 0.804 | 0.025 | 0.000 |
| 1.231 | −0.123 | 0.000 | −1.548 | 0.329 | 0.000 | 0.898 | 0.024 | 0.000 |
| 1.147 | −0.136 | 0.000 | −1.548 | 0.330 | 0.000 | 0.989 | 0.024 | 0.000 |
| 1.059 | −0.149 | 0.000 | −1.547 | 0.331 | 0.000 | 1.076 | 0.024 | 0.000 |
| 0.969 | −0.162 | 0.000 | −1.547 | 0.331 | 0.000 | 1.161 | 0.025 | 0.000 |
| 0.874 | −0.175 | 0.000 | −1.546 | 0.332 | 0.000 | 1.242 | 0.026 | 0.000 |
| 0.776 | −0.188 | 0.000 | −1.544 | 0.334 | 0.000 | 1.319 | 0.027 | 0.000 |
| 0.675 | −0.201 | 0.000 | −1.540 | 0.337 | 0.000 | 1.390 | 0.029 | 0.000 |
| 0.569 | −0.213 | 0.000 | −1.532 | 0.340 | 0.000 | 1.454 | 0.030 | 0.000 |
| 0.464 | −0.224 | 0.000 | −1.516 | 0.341 | 0.000 | 1.511 | 0.032 | 0.000 |
| 0.359 | −0.233 | 0.000 | −1.496 | 0.339 | 0.000 | 1.562 | 0.033 | 0.000 |
| 0.254 | −0.241 | 0.000 | −1.470 | 0.333 | 0.000 | 1.605 | 0.034 | 0.000 |
| 0.148 | −0.246 | 0.000 | −1.438 | 0.322 | 0.000 | 1.642 | 0.035 | 0.000 |
| 0.043 | −0.249 | 0.000 | −1.397 | 0.307 | 0.000 | 1.674 | 0.036 | 0.000 |
| −0.062 | −0.249 | 0.000 | −1.349 | 0.289 | 0.000 | 1.701 | 0.037 | 0.000 |
| −0.168 | −0.246 | 0.000 | −1.299 | 0.271 | 0.000 | 1.723 | 0.038 | 0.000 |
| −0.273 | −0.239 | 0.000 | −1.241 | 0.251 | 0.000 | 1.740 | 0.035 | 0.000 |
| −0.379 | −0.230 | 0.000 | −1.177 | 0.231 | 0.000 | 1.751 | 0.028 | 0.000 |
| −0.485 | −0.216 | 0.000 | −1.106 | 0.209 | 0.000 | 1.758 | 0.021 | 0.000 |
| −0.589 | −0.198 | 0.000 | −1.032 | 0.189 | 0.000 | 1.762 | 0.013 | 0.000 |
| −0.690 | −0.177 | 0.000 | −0.953 | 0.170 | 0.000 | 1.764 | 0.007 | 0.000 |
| −0.786 | −0.151 | 0.000 | −0.871 | 0.151 | 0.000 | | | |
| −0.877 | −0.122 | 0.000 | −0.785 | 0.135 | 0.000 | | | |
| 1.755 | −0.024 | 0.773 | −0.938 | −0.029 | 0.773 | −0.695 | 0.166 | 0.773 |
| 1.755 | −0.030 | 0.773 | −1.019 | 0.001 | 0.773 | −0.602 | 0.150 | 0.773 |
| 1.753 | −0.036 | 0.773 | −1.097 | 0.033 | 0.773 | −0.506 | 0.135 | 0.773 |
| 1.749 | −0.044 | 0.773 | −1.171 | 0.065 | 0.773 | −0.406 | 0.121 | 0.773 |
| 1.742 | −0.051 | 0.773 | −1.240 | 0.098 | 0.773 | −0.306 | 0.108 | 0.773 |
| 1.729 | −0.055 | 0.773 | −1.301 | 0.131 | 0.773 | −0.206 | 0.096 | 0.773 |
| 1.711 | −0.057 | 0.773 | −1.356 | 0.162 | 0.773 | −0.106 | 0.085 | 0.773 |
| 1.689 | −0.060 | 0.773 | −1.404 | 0.191 | 0.773 | −0.006 | 0.074 | 0.773 |
| 1.661 | −0.064 | 0.773 | −1.448 | 0.220 | 0.773 | 0.094 | 0.064 | 0.773 |
| 1.629 | −0.068 | 0.773 | −1.485 | 0.246 | 0.773 | 0.194 | 0.055 | 0.773 |
| 1.591 | −0.073 | 0.773 | −1.512 | 0.268 | 0.773 | 0.294 | 0.046 | 0.773 |
| 1.547 | −0.079 | 0.773 | −1.532 | 0.287 | 0.773 | 0.395 | 0.039 | 0.773 |
| 1.495 | −0.085 | 0.773 | −1.545 | 0.304 | 0.773 | 0.495 | 0.031 | 0.773 |
| 1.437 | −0.093 | 0.773 | −1.552 | 0.318 | 0.773 | 0.596 | 0.024 | 0.773 |
| 1.371 | −0.101 | 0.773 | −1.554 | 0.326 | 0.773 | 0.696 | 0.018 | 0.773 |
| 1.299 | −0.109 | 0.773 | −1.554 | 0.332 | 0.773 | 0.793 | 0.013 | 0.773 |
| 1.220 | −0.119 | 0.773 | −1.553 | 0.335 | 0.773 | 0.887 | 0.010 | 0.773 |
| 1.138 | −0.128 | 0.773 | −1.553 | 0.336 | 0.773 | 0.978 | 0.007 | 0.773 |
| 1.051 | −0.138 | 0.773 | −1.552 | 0.337 | 0.773 | 1.065 | 0.005 | 0.773 |
| 0.962 | −0.147 | 0.773 | −1.552 | 0.337 | 0.773 | 1.149 | 0.003 | 0.773 |
| 0.869 | −0.156 | 0.773 | −1.551 | 0.338 | 0.773 | 1.229 | 0.002 | 0.773 |
| 0.772 | −0.165 | 0.773 | −1.550 | 0.341 | 0.773 | 1.306 | 0.001 | 0.773 |
| 0.672 | −0.174 | 0.773 | −1.545 | 0.344 | 0.773 | 1.377 | 0.001 | 0.773 |
| 0.569 | −0.182 | 0.773 | −1.538 | 0.348 | 0.773 | 1.441 | 0.001 | 0.773 |
| 0.466 | −0.189 | 0.773 | −1.523 | 0.351 | 0.773 | 1.498 | 0.001 | 0.773 |
| 0.362 | −0.194 | 0.773 | −1.503 | 0.351 | 0.773 | 1.548 | 0.001 | 0.773 |
| 0.259 | −0.196 | 0.773 | −1.476 | 0.348 | 0.773 | 1.592 | 0.001 | 0.773 |
| 0.156 | −0.197 | 0.773 | −1.443 | 0.341 | 0.773 | 1.629 | 0.002 | 0.773 |
| 0.052 | −0.196 | 0.773 | −1.401 | 0.331 | 0.773 | 1.660 | 0.002 | 0.773 |
| −0.051 | −0.193 | 0.773 | −1.352 | 0.318 | 0.773 | 1.687 | 0.002 | 0.773 |
| −0.155 | −0.186 | 0.773 | −1.300 | 0.304 | 0.773 | 1.709 | 0.002 | 0.773 |
| −0.258 | −0.177 | 0.773 | −1.242 | 0.288 | 0.773 | 1.726 | 0.003 | 0.773 |
| −0.362 | −0.165 | 0.773 | −1.177 | 0.271 | 0.773 | 1.739 | 0.000 | 0.773 |
| −0.465 | −0.150 | 0.773 | −1.105 | 0.253 | 0.773 | 1.747 | −0.006 | 0.773 |

TABLE 9R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.568 | −0.131 | 0.773 | −1.030 | 0.235 | 0.773 | 1.752 | −0.013 | 0.773 |
| −0.667 | −0.109 | 0.773 | −0.951 | 0.217 | 0.773 | 1.754 | −0.019 | 0.773 |
| −0.761 | −0.084 | 0.773 | −0.869 | 0.200 | 0.773 | | | |
| −0.851 | −0.057 | 0.773 | −0.784 | 0.183 | 0.773 | | | |
| 1.754 | −0.148 | 1.546 | −0.932 | 0.014 | 1.546 | −0.698 | 0.174 | 1.546 |
| 1.753 | −0.153 | 1.546 | −1.013 | 0.045 | 1.546 | −0.606 | 0.153 | 1.546 |
| 1.751 | −0.160 | 1.546 | −1.091 | 0.077 | 1.546 | −0.510 | 0.133 | 1.546 |
| 1.745 | −0.167 | 1.546 | −1.164 | 0.110 | 1.546 | −0.411 | 0.112 | 1.546 |
| 1.737 | −0.172 | 1.546 | −1.234 | 0.143 | 1.546 | −0.312 | 0.093 | 1.546 |
| 1.723 | −0.173 | 1.546 | −1.296 | 0.174 | 1.546 | −0.212 | 0.075 | 1.546 |
| 1.705 | −0.174 | 1.546 | −1.351 | 0.204 | 1.546 | −0.112 | 0.057 | 1.546 |
| 1.682 | −0.176 | 1.546 | −1.400 | 0.232 | 1.546 | −0.013 | 0.040 | 1.546 |
| 1.655 | −0.177 | 1.546 | −1.444 | 0.259 | 1.546 | 0.087 | 0.024 | 1.546 |
| 1.623 | −0.180 | 1.546 | −1.483 | 0.284 | 1.546 | 0.187 | 0.009 | 1.546 |
| 1.585 | −0.182 | 1.546 | −1.511 | 0.304 | 1.546 | 0.288 | −0.005 | 1.546 |
| 1.540 | −0.185 | 1.546 | −1.532 | 0.323 | 1.546 | 0.388 | −0.019 | 1.546 |
| 1.488 | −0.188 | 1.546 | −1.546 | 0.339 | 1.546 | 0.488 | −0.032 | 1.546 |
| 1.430 | −0.191 | 1.546 | −1.554 | 0.352 | 1.546 | 0.589 | −0.044 | 1.546 |
| 1.364 | −0.195 | 1.546 | −1.556 | 0.360 | 1.546 | 0.689 | −0.055 | 1.546 |
| 1.292 | −0.200 | 1.546 | −1.556 | 0.366 | 1.546 | 0.787 | −0.065 | 1.546 |
| 1.212 | −0.204 | 1.546 | −1.556 | 0.369 | 1.546 | 0.881 | −0.074 | 1.546 |
| 1.130 | −0.208 | 1.546 | −1.555 | 0.370 | 1.546 | 0.972 | −0.081 | 1.546 |
| 1.043 | −0.212 | 1.546 | −1.555 | 0.371 | 1.546 | 1.059 | −0.088 | 1.546 |
| 0.954 | −0.216 | 1.546 | −1.555 | 0.371 | 1.546 | 1.143 | −0.094 | 1.546 |
| 0.860 | −0.219 | 1.546 | −1.554 | 0.372 | 1.546 | 1.224 | −0.099 | 1.546 |
| 0.764 | −0.222 | 1.546 | −1.552 | 0.375 | 1.546 | 1.302 | −0.103 | 1.546 |
| 0.664 | −0.224 | 1.546 | −1.548 | 0.378 | 1.546 | 1.372 | −0.107 | 1.546 |
| 0.561 | −0.225 | 1.546 | −1.540 | 0.381 | 1.546 | 1.436 | −0.111 | 1.546 |
| 0.457 | −0.225 | 1.546 | −1.525 | 0.384 | 1.546 | 1.494 | −0.113 | 1.546 |
| 0.354 | −0.223 | 1.546 | −1.505 | 0.384 | 1.546 | 1.544 | −0.116 | 1.546 |
| 0.251 | −0.219 | 1.546 | −1.478 | 0.380 | 1.546 | 1.588 | −0.118 | 1.546 |
| 0.149 | −0.213 | 1.546 | −1.445 | 0.373 | 1.546 | 1.625 | −0.119 | 1.546 |
| 0.046 | −0.204 | 1.546 | −1.403 | 0.361 | 1.546 | 1.657 | −0.121 | 1.546 |
| −0.056 | −0.194 | 1.546 | −1.354 | 0.348 | 1.546 | 1.684 | −0.122 | 1.546 |
| −0.159 | −0.181 | 1.546 | −1.302 | 0.333 | 1.546 | 1.706 | −0.123 | 1.546 |
| −0.261 | −0.165 | 1.546 | −1.243 | 0.317 | 1.546 | 1.723 | −0.123 | 1.546 |
| −0.363 | −0.146 | 1.546 | −1.178 | 0.298 | 1.546 | 1.737 | −0.125 | 1.546 |
| −0.464 | −0.125 | 1.546 | −1.107 | 0.278 | 1.546 | 1.745 | −0.130 | 1.546 |
| −0.566 | −0.101 | 1.546 | −1.032 | 0.258 | 1.546 | 1.751 | −0.137 | 1.546 |
| −0.664 | −0.074 | 1.546 | −0.954 | 0.237 | 1.546 | 1.753 | −0.143 | 1.546 |
| −0.757 | −0.046 | 1.546 | −0.872 | 0.216 | 1.546 | | | |
| −0.847 | −0.017 | 1.546 | −0.787 | 0.195 | 1.546 | | | |
| 1.755 | −0.288 | 2.319 | −0.921 | 0.029 | 2.319 | −0.690 | 0.155 | 2.319 |
| 1.754 | −0.293 | 2.319 | −1.001 | 0.062 | 2.319 | −0.598 | 0.131 | 2.319 |
| 1.751 | −0.300 | 2.319 | −1.078 | 0.095 | 2.319 | −0.503 | 0.106 | 2.319 |
| 1.745 | −0.306 | 2.319 | −1.150 | 0.129 | 2.319 | −0.405 | 0.081 | 2.319 |
| 1.735 | −0.309 | 2.319 | −1.219 | 0.163 | 2.319 | −0.306 | 0.057 | 2.319 |
| 1.722 | −0.310 | 2.319 | −1.281 | 0.195 | 2.319 | −0.207 | 0.034 | 2.319 |
| 1.704 | −0.309 | 2.319 | −1.336 | 0.224 | 2.319 | −0.108 | 0.011 | 2.319 |
| 1.681 | −0.309 | 2.319 | −1.385 | 0.252 | 2.319 | −0.008 | −0.011 | 2.319 |
| 1.654 | −0.309 | 2.319 | −1.429 | 0.279 | 2.319 | 0.091 | −0.032 | 2.319 |
| 1.622 | −0.309 | 2.319 | −1.467 | 0.304 | 2.319 | 0.191 | −0.052 | 2.319 |
| 1.584 | −0.308 | 2.319 | −1.496 | 0.324 | 2.319 | 0.291 | −0.071 | 2.319 |
| 1.539 | −0.308 | 2.319 | −1.517 | 0.341 | 2.319 | 0.390 | −0.090 | 2.319 |
| 1.487 | −0.308 | 2.319 | −1.532 | 0.357 | 2.319 | 0.491 | −0.108 | 2.319 |
| 1.428 | −0.307 | 2.319 | −1.540 | 0.370 | 2.319 | 0.591 | −0.125 | 2.319 |
| 1.363 | −0.307 | 2.319 | −1.543 | 0.378 | 2.319 | 0.691 | −0.141 | 2.319 |
| 1.290 | −0.307 | 2.319 | −1.544 | 0.383 | 2.319 | 0.788 | −0.156 | 2.319 |
| 1.211 | −0.306 | 2.319 | −1.543 | 0.386 | 2.319 | 0.882 | −0.170 | 2.319 |
| 1.128 | −0.305 | 2.319 | −1.543 | 0.387 | 2.319 | 0.973 | −0.183 | 2.319 |
| 1.041 | −0.304 | 2.319 | −1.542 | 0.388 | 2.319 | 1.060 | −0.195 | 2.319 |
| 0.952 | −0.303 | 2.319 | −1.542 | 0.389 | 2.319 | 1.144 | −0.205 | 2.319 |
| 0.859 | −0.301 | 2.319 | −1.541 | 0.390 | 2.319 | 1.225 | −0.215 | 2.319 |
| 0.762 | −0.298 | 2.319 | −1.539 | 0.392 | 2.319 | 1.302 | −0.224 | 2.319 |
| 0.662 | −0.293 | 2.319 | −1.535 | 0.395 | 2.319 | 1.373 | −0.231 | 2.319 |
| 0.559 | −0.288 | 2.319 | −1.527 | 0.398 | 2.319 | 1.437 | −0.238 | 2.319 |
| 0.456 | −0.280 | 2.319 | −1.512 | 0.399 | 2.319 | 1.495 | −0.244 | 2.319 |
| 0.354 | −0.272 | 2.319 | −1.491 | 0.398 | 2.319 | 1.545 | −0.248 | 2.319 |
| 0.251 | −0.261 | 2.319 | −1.465 | 0.392 | 2.319 | 1.589 | −0.252 | 2.319 |
| 0.149 | −0.249 | 2.319 | −1.432 | 0.383 | 2.319 | 1.626 | −0.256 | 2.319 |
| 0.047 | −0.234 | 2.319 | −1.390 | 0.370 | 2.319 | 1.658 | −0.259 | 2.319 |
| −0.055 | −0.217 | 2.319 | −1.341 | 0.355 | 2.319 | 1.685 | −0.261 | 2.319 |
| −0.156 | −0.198 | 2.319 | −1.290 | 0.339 | 2.319 | 1.707 | −0.263 | 2.319 |
| −0.257 | −0.177 | 2.319 | −1.232 | 0.320 | 2.319 | 1.724 | −0.264 | 2.319 |
| −0.358 | −0.153 | 2.319 | −1.167 | 0.299 | 2.319 | 1.738 | −0.265 | 2.319 |
| −0.459 | −0.126 | 2.319 | −1.096 | 0.276 | 2.319 | 1.747 | −0.270 | 2.319 |
| −0.559 | −0.098 | 2.319 | −1.022 | 0.253 | 2.319 | 1.752 | −0.277 | 2.319 |

TABLE 9R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.656 | −0.067 | 2.319 | −0.944 | 0.229 | 2.319 | 1.755 | −0.283 | 2.319 |
| −0.748 | −0.036 | 2.319 | −0.863 | 0.205 | 2.319 | | | |
| −0.836 | −0.004 | 2.319 | −0.778 | 0.180 | 2.319 | | | |
| 1.746 | −0.421 | 3.091 | −0.922 | 0.036 | 3.091 | −0.693 | 0.131 | 3.091 |
| 1.745 | −0.426 | 3.091 | −1.001 | 0.071 | 3.091 | −0.601 | 0.103 | 3.091 |
| 1.741 | −0.432 | 3.091 | −1.077 | 0.107 | 3.091 | −0.507 | 0.074 | 3.091 |
| 1.735 | −0.438 | 3.091 | −1.148 | 0.142 | 3.091 | −0.409 | 0.046 | 3.091 |
| 1.725 | −0.440 | 3.091 | −1.216 | 0.177 | 3.091 | −0.310 | 0.018 | 3.091 |
| 1.711 | −0.439 | 3.091 | −1.278 | 0.209 | 3.091 | −0.212 | −0.010 | 3.091 |
| 1.693 | −0.438 | 3.091 | −1.332 | 0.240 | 3.091 | −0.113 | −0.036 | 3.091 |
| 1.670 | −0.437 | 3.091 | −1.380 | 0.268 | 3.091 | −0.014 | −0.062 | 3.091 |
| 1.643 | −0.435 | 3.091 | −1.425 | 0.296 | 3.091 | 0.085 | −0.087 | 3.091 |
| 1.611 | −0.433 | 3.091 | −1.463 | 0.320 | 3.091 | 0.184 | −0.112 | 3.091 |
| 1.573 | −0.431 | 3.091 | −1.492 | 0.340 | 3.091 | 0.284 | −0.136 | 3.091 |
| 1.528 | −0.428 | 3.091 | −1.513 | 0.357 | 3.091 | 0.383 | −0.159 | 3.091 |
| 1.476 | −0.425 | 3.091 | −1.528 | 0.371 | 3.091 | 0.483 | −0.182 | 3.091 |
| 1.417 | −0.421 | 3.091 | −1.537 | 0.384 | 3.091 | 0.583 | −0.204 | 3.091 |
| 1.351 | −0.417 | 3.091 | −1.540 | 0.392 | 3.091 | 0.683 | −0.225 | 3.091 |
| 1.279 | −0.412 | 3.091 | −1.541 | 0.398 | 3.091 | 0.780 | −0.245 | 3.091 |
| 1.199 | −0.407 | 3.091 | −1.540 | 0.401 | 3.091 | 0.874 | −0.263 | 3.091 |
| 1.117 | −0.402 | 3.091 | −1.540 | 0.402 | 3.091 | 0.964 | −0.280 | 3.091 |
| 1.030 | −0.396 | 3.091 | −1.540 | 0.403 | 3.091 | 1.051 | −0.296 | 3.091 |
| 0.941 | −0.389 | 3.091 | −1.539 | 0.403 | 3.091 | 1.135 | −0.311 | 3.091 |
| 0.848 | −0.381 | 3.091 | −1.538 | 0.404 | 3.091 | 1.216 | −0.324 | 3.091 |
| 0.751 | −0.372 | 3.091 | −1.537 | 0.406 | 3.091 | 1.293 | −0.337 | 3.091 |
| 0.652 | −0.362 | 3.091 | −1.532 | 0.409 | 3.091 | 1.364 | −0.347 | 3.091 |
| 0.549 | −0.350 | 3.091 | −1.523 | 0.411 | 3.091 | 1.428 | −0.357 | 3.091 |
| 0.446 | −0.337 | 3.091 | −1.508 | 0.411 | 3.091 | 1.486 | −0.365 | 3.091 |
| 0.343 | −0.322 | 3.091 | −1.488 | 0.408 | 3.091 | 1.536 | −0.372 | 3.091 |
| 0.241 | −0.305 | 3.091 | −1.461 | 0.401 | 3.091 | 1.580 | −0.378 | 3.091 |
| 0.139 | −0.287 | 3.091 | −1.429 | 0.390 | 3.091 | 1.617 | −0.383 | 3.091 |
| 0.037 | −0.266 | 3.091 | −1.387 | 0.375 | 3.091 | 1.649 | −0.388 | 3.091 |
| −0.064 | −0.244 | 3.091 | −1.339 | 0.358 | 3.091 | 1.676 | −0.391 | 3.091 |
| −0.165 | −0.220 | 3.091 | −1.288 | 0.339 | 3.091 | 1.698 | −0.394 | 3.091 |
| −0.266 | −0.193 | 3.091 | −1.230 | 0.318 | 3.091 | 1.716 | −0.396 | 3.091 |
| −0.366 | −0.164 | 3.091 | −1.167 | 0.294 | 3.091 | 1.729 | −0.398 | 3.091 |
| −0.466 | −0.134 | 3.091 | −1.096 | 0.269 | 3.091 | 1.738 | −0.402 | 3.091 |
| −0.565 | −0.101 | 3.091 | −1.022 | 0.242 | 3.091 | 1.744 | −0.409 | 3.091 |
| −0.660 | −0.068 | 3.091 | −0.945 | 0.215 | 3.091 | 1.746 | −0.416 | 3.091 |
| −0.751 | −0.034 | 3.091 | −0.864 | 0.188 | 3.091 | | | |
| −0.838 | 0.001 | 3.091 | −0.780 | 0.160 | 3.091 | | | |
| 1.719 | −0.518 | 3.864 | −0.935 | 0.056 | 3.864 | −0.709 | 0.129 | 3.864 |
| 1.718 | −0.523 | 3.864 | −1.014 | 0.093 | 3.864 | −0.619 | 0.097 | 3.864 |
| 1.714 | −0.529 | 3.864 | −1.088 | 0.130 | 3.864 | −0.525 | 0.065 | 3.864 |
| 1.707 | −0.534 | 3.864 | −1.159 | 0.166 | 3.864 | −0.427 | 0.033 | 3.864 |
| 1.697 | −0.536 | 3.864 | −1.227 | 0.202 | 3.864 | −0.329 | 0.002 | 3.864 |
| 1.683 | −0.534 | 3.864 | −1.287 | 0.236 | 3.864 | −0.231 | −0.029 | 3.864 |
| 1.665 | −0.532 | 3.864 | −1.342 | 0.268 | 3.864 | −0.132 | −0.058 | 3.864 |
| 1.642 | −0.530 | 3.864 | −1.389 | 0.297 | 3.864 | −0.034 | −0.088 | 3.864 |
| 1.615 | −0.527 | 3.864 | −1.434 | 0.325 | 3.864 | 0.065 | −0.116 | 3.864 |
| 1.583 | −0.524 | 3.864 | −1.472 | 0.349 | 3.864 | 0.164 | −0.145 | 3.864 |
| 1.545 | −0.519 | 3.864 | −1.501 | 0.369 | 3.864 | 0.262 | −0.172 | 3.864 |
| 1.500 | −0.515 | 3.864 | −1.523 | 0.386 | 3.864 | 0.362 | −0.200 | 3.864 |
| 1.448 | −0.509 | 3.864 | −1.538 | 0.400 | 3.864 | 0.461 | −0.226 | 3.864 |
| 1.389 | −0.503 | 3.864 | −1.548 | 0.413 | 3.864 | 0.560 | −0.252 | 3.864 |
| 1.323 | −0.495 | 3.864 | −1.551 | 0.421 | 3.864 | 0.660 | −0.277 | 3.864 |
| 1.251 | −0.487 | 3.864 | −1.552 | 0.426 | 3.864 | 0.756 | −0.301 | 3.864 |
| 1.171 | −0.478 | 3.864 | −1.552 | 0.429 | 3.864 | 0.850 | −0.324 | 3.864 |
| 1.088 | −0.469 | 3.864 | −1.551 | 0.431 | 3.864 | 0.940 | −0.345 | 3.864 |
| 1.002 | −0.458 | 3.864 | −1.551 | 0.431 | 3.864 | 1.027 | −0.364 | 3.864 |
| 0.912 | −0.447 | 3.864 | −1.551 | 0.432 | 3.864 | 1.110 | −0.383 | 3.864 |
| 0.819 | −0.435 | 3.864 | −1.550 | 0.433 | 3.864 | 1.191 | −0.400 | 3.864 |
| 0.723 | −0.421 | 3.864 | −1.548 | 0.435 | 3.864 | 1.268 | −0.415 | 3.864 |
| 0.624 | −0.405 | 3.864 | −1.543 | 0.437 | 3.864 | 1.339 | −0.429 | 3.864 |
| 0.521 | −0.388 | 3.864 | −1.534 | 0.439 | 3.864 | 1.403 | −0.441 | 3.864 |
| 0.419 | −0.370 | 3.864 | −1.519 | 0.438 | 3.864 | 1.460 | −0.452 | 3.864 |
| 0.316 | −0.350 | 3.864 | −1.499 | 0.433 | 3.864 | 1.511 | −0.461 | 3.864 |
| 0.215 | −0.328 | 3.864 | −1.473 | 0.424 | 3.864 | 1.554 | −0.469 | 3.864 |
| 0.113 | −0.305 | 3.864 | −1.441 | 0.412 | 3.864 | 1.592 | −0.476 | 3.864 |
| 0.012 | −0.280 | 3.864 | −1.399 | 0.396 | 3.864 | 1.623 | −0.481 | 3.864 |
| −0.089 | −0.253 | 3.864 | −1.351 | 0.377 | 3.864 | 1.650 | −0.486 | 3.864 |
| −0.190 | −0.224 | 3.864 | −1.301 | 0.356 | 3.864 | 1.672 | −0.489 | 3.864 |
| −0.290 | −0.193 | 3.864 | −1.243 | 0.333 | 3.864 | 1.690 | −0.492 | 3.864 |
| −0.389 | −0.161 | 3.864 | −1.180 | 0.307 | 3.864 | 1.703 | −0.495 | 3.864 |
| −0.487 | −0.127 | 3.864 | −1.110 | 0.279 | 3.864 | 1.712 | −0.499 | 3.864 |
| −0.585 | −0.091 | 3.864 | −1.037 | 0.251 | 3.864 | 1.717 | −0.506 | 3.864 |
| −0.678 | −0.055 | 3.864 | −0.960 | 0.221 | 3.864 | 1.719 | −0.513 | 3.864 |

TABLE 9R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.768 | −0.018 | 3.864 | −0.880 | 0.191 | 3.864 | | | |
| −0.853 | 0.019 | 3.864 | −0.796 | 0.160 | 3.864 | | | |
| 1.704 | −0.553 | 4.251 | −0.945 | 0.066 | 4.251 | −0.719 | 0.131 | 4.251 |
| 1.703 | −0.558 | 4.251 | −1.023 | 0.104 | 4.251 | −0.629 | 0.098 | 4.251 |
| 1.699 | −0.564 | 4.251 | −1.098 | 0.142 | 4.251 | −0.535 | 0.065 | 4.251 |
| 1.692 | −0.569 | 4.251 | −1.169 | 0.179 | 4.251 | −0.438 | 0.031 | 4.251 |
| 1.681 | −0.571 | 4.251 | −1.236 | 0.216 | 4.251 | −0.340 | −0.001 | 4.251 |
| 1.668 | −0.569 | 4.251 | −1.297 | 0.251 | 4.251 | −0.242 | −0.033 | 4.251 |
| 1.650 | −0.567 | 4.251 | −1.351 | 0.283 | 4.251 | −0.144 | −0.064 | 4.251 |
| 1.627 | −0.564 | 4.251 | −1.398 | 0.312 | 4.251 | −0.046 | −0.094 | 4.251 |
| 1.600 | −0.560 | 4.251 | −1.442 | 0.340 | 4.251 | 0.053 | −0.124 | 4.251 |
| 1.568 | −0.556 | 4.251 | −1.480 | 0.365 | 4.251 | 0.151 | −0.154 | 4.251 |
| 1.530 | −0.552 | 4.251 | −1.509 | 0.385 | 4.251 | 0.250 | −0.183 | 4.251 |
| 1.485 | −0.546 | 4.251 | −1.531 | 0.402 | 4.251 | 0.349 | −0.212 | 4.251 |
| 1.433 | −0.539 | 4.251 | −1.546 | 0.416 | 4.251 | 0.448 | −0.240 | 4.251 |
| 1.374 | −0.532 | 4.251 | −1.556 | 0.428 | 4.251 | 0.547 | −0.267 | 4.251 |
| 1.309 | −0.524 | 4.251 | −1.559 | 0.436 | 4.251 | 0.647 | −0.294 | 4.251 |
| 1.236 | −0.514 | 4.251 | −1.560 | 0.442 | 4.251 | 0.743 | −0.320 | 4.251 |
| 1.157 | −0.504 | 4.251 | −1.560 | 0.444 | 4.251 | 0.836 | −0.344 | 4.251 |
| 1.074 | −0.493 | 4.251 | −1.559 | 0.446 | 4.251 | 0.926 | −0.366 | 4.251 |
| 0.988 | −0.481 | 4.251 | −1.559 | 0.446 | 4.251 | 1.013 | −0.388 | 4.251 |
| 0.899 | −0.468 | 4.251 | −1.559 | 0.447 | 4.251 | 1.096 | −0.407 | 4.251 |
| 0.806 | −0.454 | 4.251 | −1.558 | 0.448 | 4.251 | 1.177 | −0.426 | 4.251 |
| 0.710 | −0.439 | 4.251 | −1.556 | 0.450 | 4.251 | 1.254 | −0.443 | 4.251 |
| 0.611 | −0.422 | 4.251 | −1.551 | 0.452 | 4.251 | 1.324 | −0.458 | 4.251 |
| 0.509 | −0.403 | 4.251 | −1.542 | 0.453 | 4.251 | 1.388 | −0.471 | 4.251 |
| 0.407 | −0.382 | 4.251 | −1.527 | 0.452 | 4.251 | 1.445 | −0.483 | 4.251 |
| 0.305 | −0.360 | 4.251 | −1.507 | 0.447 | 4.251 | 1.496 | −0.493 | 4.251 |
| 0.203 | −0.337 | 4.251 | −1.481 | 0.437 | 4.251 | 1.540 | −0.502 | 4.251 |
| 0.102 | −0.312 | 4.251 | −1.449 | 0.425 | 4.251 | 1.577 | −0.509 | 4.251 |
| 0.001 | −0.285 | 4.251 | −1.407 | 0.408 | 4.251 | 1.608 | −0.515 | 4.251 |
| −0.099 | −0.257 | 4.251 | −1.360 | 0.388 | 4.251 | 1.635 | −0.520 | 4.251 |
| −0.199 | −0.226 | 4.251 | −1.309 | 0.367 | 4.251 | 1.657 | −0.524 | 4.251 |
| −0.299 | −0.194 | 4.251 | −1.252 | 0.343 | 4.251 | 1.674 | −0.527 | 4.251 |
| −0.398 | −0.160 | 4.251 | −1.189 | 0.316 | 4.251 | 1.688 | −0.530 | 4.251 |
| −0.496 | −0.124 | 4.251 | −1.119 | 0.287 | 4.251 | 1.697 | −0.534 | 4.251 |
| −0.593 | −0.087 | 4.251 | −1.046 | 0.257 | 4.251 | 1.702 | −0.541 | 4.251 |
| −0.687 | −0.049 | 4.251 | −0.969 | 0.227 | 4.251 | 1.704 | −0.548 | 4.251 |
| −0.777 | −0.011 | 4.251 | −0.889 | 0.195 | 4.251 | | | |
| −0.863 | 0.028 | 4.251 | −0.806 | 0.163 | 4.251 | | | |
| 1.686 | −0.585 | 4.637 | −0.956 | 0.079 | 4.637 | −0.731 | 0.137 | 4.637 |
| 1.685 | −0.590 | 4.637 | −1.034 | 0.118 | 4.637 | −0.641 | 0.103 | 4.637 |
| 1.681 | −0.596 | 4.637 | −1.109 | 0.156 | 4.637 | −0.548 | 0.068 | 4.637 |
| 1.674 | −0.601 | 4.637 | −1.179 | 0.195 | 4.637 | −0.451 | 0.033 | 4.637 |
| 1.663 | −0.602 | 4.637 | −1.246 | 0.232 | 4.637 | −0.354 | −0.001 | 4.637 |
| 1.649 | −0.600 | 4.637 | −1.307 | 0.267 | 4.637 | −0.256 | −0.034 | 4.637 |
| 1.632 | −0.597 | 4.637 | −1.360 | 0.300 | 4.637 | −0.158 | −0.066 | 4.637 |
| 1.609 | −0.594 | 4.637 | −1.408 | 0.329 | 4.637 | −0.060 | −0.098 | 4.637 |
| 1.582 | −0.591 | 4.637 | −1.452 | 0.358 | 4.637 | 0.039 | −0.129 | 4.637 |
| 1.549 | −0.586 | 4.637 | −1.489 | 0.383 | 4.637 | 0.137 | −0.160 | 4.637 |
| 1.512 | −0.581 | 4.637 | −1.518 | 0.403 | 4.637 | 0.236 | −0.190 | 4.637 |
| 1.467 | −0.574 | 4.637 | −1.540 | 0.420 | 4.637 | 0.335 | −0.220 | 4.637 |
| 1.415 | −0.567 | 4.637 | −1.556 | 0.434 | 4.637 | 0.434 | −0.250 | 4.637 |
| 1.356 | −0.558 | 4.637 | −1.565 | 0.446 | 4.637 | 0.533 | −0.279 | 4.637 |
| 1.291 | −0.549 | 4.637 | −1.569 | 0.454 | 4.637 | 0.632 | −0.307 | 4.637 |
| 1.219 | −0.538 | 4.637 | −1.570 | 0.460 | 4.637 | 0.728 | −0.334 | 4.637 |
| 1.139 | −0.527 | 4.637 | −1.570 | 0.463 | 4.637 | 0.821 | −0.360 | 4.637 |
| 1.057 | −0.514 | 4.637 | −1.569 | 0.464 | 4.637 | 0.910 | −0.384 | 4.637 |
| 0.971 | −0.501 | 4.637 | −1.569 | 0.465 | 4.637 | 0.997 | −0.407 | 4.637 |
| 0.882 | −0.487 | 4.637 | −1.569 | 0.465 | 4.637 | 1.080 | −0.428 | 4.637 |
| 0.789 | −0.471 | 4.637 | −1.568 | 0.466 | 4.637 | 1.160 | −0.448 | 4.637 |
| 0.693 | −0.454 | 4.637 | −1.565 | 0.468 | 4.637 | 1.237 | −0.467 | 4.637 |
| 0.594 | −0.435 | 4.637 | −1.560 | 0.470 | 4.637 | 1.308 | −0.483 | 4.637 |
| 0.492 | −0.414 | 4.637 | −1.552 | 0.471 | 4.637 | 1.371 | −0.498 | 4.637 |
| 0.390 | −0.392 | 4.637 | −1.536 | 0.469 | 4.637 | 1.428 | −0.511 | 4.637 |
| 0.288 | −0.369 | 4.637 | −1.516 | 0.463 | 4.637 | 1.479 | −0.522 | 4.637 |
| 0.187 | −0.344 | 4.637 | −1.491 | 0.453 | 4.637 | 1.523 | −0.531 | 4.637 |
| 0.086 | −0.317 | 4.637 | −1.459 | 0.440 | 4.637 | 1.560 | −0.539 | 4.637 |
| −0.014 | −0.288 | 4.637 | −1.418 | 0.423 | 4.637 | 1.591 | −0.546 | 4.637 |
| −0.115 | −0.258 | 4.637 | −1.370 | 0.402 | 4.637 | 1.618 | −0.551 | 4.637 |
| −0.214 | −0.226 | 4.637 | −1.320 | 0.380 | 4.637 | 1.640 | −0.556 | 4.637 |
| −0.313 | −0.192 | 4.637 | −1.263 | 0.356 | 4.637 | 1.657 | −0.559 | 4.637 |
| −0.411 | −0.156 | 4.637 | −1.200 | 0.328 | 4.637 | 1.671 | −0.562 | 4.637 |
| −0.509 | −0.118 | 4.637 | −1.130 | 0.299 | 4.637 | 1.680 | −0.567 | 4.637 |
| −0.606 | −0.079 | 4.637 | −1.057 | 0.268 | 4.637 | 1.685 | −0.573 | 4.637 |
| −0.700 | −0.040 | 4.637 | −0.981 | 0.236 | 4.637 | 1.687 | −0.580 | 4.637 |
| −0.789 | 0.000 | 4.637 | −0.901 | 0.204 | 4.637 | | | |

TABLE 9R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.874 | 0.039 | 4.637 | −0.818 | 0.171 | 4.637 | | | |
| 1.631 | −0.627 | 5.410 | −0.997 | 0.127 | 5.410 | −0.774 | 0.171 | 5.410 |
| 1.629 | −0.632 | 5.410 | −1.074 | 0.168 | 5.410 | −0.685 | 0.134 | 5.410 |
| 1.625 | −0.637 | 5.410 | −1.147 | 0.210 | 5.410 | −0.592 | 0.096 | 5.410 |
| 1.618 | −0.642 | 5.410 | −1.217 | 0.250 | 5.410 | −0.496 | 0.058 | 5.410 |
| 1.607 | −0.642 | 5.410 | −1.283 | 0.290 | 5.410 | −0.399 | 0.022 | 5.410 |
| 1.593 | −0.640 | 5.410 | −1.342 | 0.327 | 5.410 | −0.302 | −0.015 | 5.410 |
| 1.575 | −0.637 | 5.410 | −1.395 | 0.362 | 5.410 | −0.204 | −0.050 | 5.410 |
| 1.553 | −0.633 | 5.410 | −1.442 | 0.393 | 5.410 | −0.107 | −0.084 | 5.410 |
| 1.526 | −0.629 | 5.410 | −1.485 | 0.423 | 5.410 | −0.009 | −0.118 | 5.410 |
| 1.493 | −0.623 | 5.410 | −1.522 | 0.449 | 5.410 | 0.089 | −0.151 | 5.410 |
| 1.456 | −0.617 | 5.410 | −1.550 | 0.471 | 5.410 | 0.188 | −0.184 | 5.410 |
| 1.411 | −0.609 | 5.410 | −1.572 | 0.488 | 5.410 | 0.286 | −0.217 | 5.410 |
| 1.359 | −0.600 | 5.410 | −1.588 | 0.502 | 5.410 | 0.384 | −0.249 | 5.410 |
| 1.301 | −0.590 | 5.410 | −1.597 | 0.514 | 5.410 | 0.483 | −0.281 | 5.410 |
| 1.235 | −0.578 | 5.410 | −1.601 | 0.522 | 5.410 | 0.582 | −0.313 | 5.410 |
| 1.163 | −0.565 | 5.410 | −1.603 | 0.528 | 5.410 | 0.677 | −0.343 | 5.410 |
| 1.084 | −0.551 | 5.410 | −1.602 | 0.530 | 5.410 | 0.769 | −0.371 | 5.410 |
| 1.002 | −0.536 | 5.410 | −1.602 | 0.532 | 5.410 | 0.859 | −0.399 | 5.410 |
| 0.916 | −0.519 | 5.410 | −1.601 | 0.532 | 5.410 | 0.945 | −0.424 | 5.410 |
| 0.827 | −0.502 | 5.410 | −1.601 | 0.533 | 5.410 | 1.028 | −0.448 | 5.410 |
| 0.735 | −0.483 | 5.410 | −1.600 | 0.534 | 5.410 | 1.107 | −0.471 | 5.410 |
| 0.639 | −0.463 | 5.410 | −1.598 | 0.535 | 5.410 | 1.184 | −0.492 | 5.410 |
| 0.540 | −0.441 | 5.410 | −1.592 | 0.537 | 5.410 | 1.254 | −0.511 | 5.410 |
| 0.438 | −0.417 | 5.410 | −1.584 | 0.537 | 5.410 | 1.317 | −0.528 | 5.410 |
| 0.337 | −0.392 | 5.410 | −1.568 | 0.534 | 5.410 | 1.374 | −0.542 | 5.410 |
| 0.236 | −0.365 | 5.410 | −1.549 | 0.527 | 5.410 | 1.424 | −0.555 | 5.410 |
| 0.136 | −0.336 | 5.410 | −1.524 | 0.515 | 5.410 | 1.468 | −0.567 | 5.410 |
| 0.035 | −0.305 | 5.410 | −1.492 | 0.501 | 5.410 | 1.505 | −0.576 | 5.410 |
| −0.064 | −0.273 | 5.410 | −1.452 | 0.481 | 5.410 | 1.536 | −0.584 | 5.410 |
| −0.163 | −0.238 | 5.410 | −1.405 | 0.459 | 5.410 | 1.563 | −0.590 | 5.410 |
| −0.262 | −0.203 | 5.410 | −1.355 | 0.435 | 5.410 | 1.585 | −0.595 | 5.410 |
| −0.360 | −0.165 | 5.410 | −1.299 | 0.408 | 5.410 | 1.602 | −0.600 | 5.410 |
| −0.458 | −0.126 | 5.410 | −1.237 | 0.378 | 5.410 | 1.616 | −0.603 | 5.410 |
| −0.555 | −0.085 | 5.410 | −1.168 | 0.346 | 5.410 | 1.625 | −0.608 | 5.410 |
| −0.651 | −0.043 | 5.410 | −1.096 | 0.312 | 5.410 | 1.630 | −0.615 | 5.410 |
| −0.743 | 0.000 | 5.410 | −1.021 | 0.278 | 5.410 | 1.631 | −0.621 | 5.410 |
| −0.832 | 0.042 | 5.410 | −0.942 | 0.243 | 5.410 | | | |
| −0.916 | 0.085 | 5.410 | −0.860 | 0.207 | 5.410 | | | |
| 1.580 | −0.675 | 5.797 | −1.018 | 0.197 | 5.797 | −0.797 | 0.223 | 5.797 |
| 1.578 | −0.680 | 5.797 | −1.093 | 0.244 | 5.797 | −0.709 | 0.180 | 5.797 |
| 1.574 | −0.686 | 5.797 | −1.164 | 0.289 | 5.797 | −0.619 | 0.137 | 5.797 |
| 1.566 | −0.690 | 5.797 | −1.231 | 0.334 | 5.797 | −0.524 | 0.094 | 5.797 |
| 1.556 | −0.691 | 5.797 | −1.295 | 0.378 | 5.797 | −0.429 | 0.051 | 5.797 |
| 1.542 | −0.688 | 5.797 | −1.353 | 0.419 | 5.797 | −0.334 | 0.010 | 5.797 |
| 1.524 | −0.685 | 5.797 | −1.404 | 0.456 | 5.797 | −0.238 | −0.031 | 5.797 |
| 1.502 | −0.681 | 5.797 | −1.449 | 0.491 | 5.797 | −0.142 | −0.070 | 5.797 |
| 1.474 | −0.676 | 5.797 | −1.490 | 0.523 | 5.797 | −0.046 | −0.109 | 5.797 |
| 1.442 | −0.670 | 5.797 | −1.526 | 0.552 | 5.797 | 0.051 | −0.147 | 5.797 |
| 1.404 | −0.663 | 5.797 | −1.553 | 0.575 | 5.797 | 0.148 | −0.184 | 5.797 |
| 1.359 | −0.654 | 5.797 | −1.574 | 0.593 | 5.797 | 0.245 | −0.221 | 5.797 |
| 1.307 | −0.645 | 5.797 | −1.589 | 0.608 | 5.797 | 0.342 | −0.258 | 5.797 |
| 1.249 | −0.633 | 5.797 | −1.598 | 0.621 | 5.797 | 0.440 | −0.294 | 5.797 |
| 1.183 | −0.620 | 5.797 | −1.602 | 0.629 | 5.797 | 0.537 | −0.330 | 5.797 |
| 1.111 | −0.606 | 5.797 | −1.603 | 0.635 | 5.797 | 0.632 | −0.364 | 5.797 |
| 1.032 | −0.589 | 5.797 | −1.603 | 0.637 | 5.797 | 0.724 | −0.396 | 5.797 |
| 0.950 | −0.571 | 5.797 | −1.602 | 0.639 | 5.797 | 0.812 | −0.427 | 5.797 |
| 0.864 | −0.552 | 5.797 | −1.602 | 0.639 | 5.797 | 0.897 | −0.455 | 5.797 |
| 0.775 | −0.532 | 5.797 | −1.601 | 0.640 | 5.797 | 0.980 | −0.482 | 5.797 |
| 0.683 | −0.510 | 5.797 | −1.600 | 0.641 | 5.797 | 1.059 | −0.507 | 5.797 |
| 0.588 | −0.486 | 5.797 | −1.598 | 0.642 | 5.797 | 1.135 | −0.531 | 5.797 |
| 0.490 | −0.459 | 5.797 | −1.592 | 0.643 | 5.797 | 1.205 | −0.552 | 5.797 |
| 0.389 | −0.430 | 5.797 | −1.583 | 0.642 | 5.797 | 1.268 | −0.570 | 5.797 |
| 0.289 | −0.400 | 5.797 | −1.569 | 0.638 | 5.797 | 1.325 | −0.586 | 5.797 |
| 0.189 | −0.367 | 5.797 | −1.550 | 0.629 | 5.797 | 1.375 | −0.600 | 5.797 |
| 0.090 | −0.333 | 5.797 | −1.525 | 0.616 | 5.797 | 1.418 | −0.612 | 5.797 |
| −0.008 | −0.297 | 5.797 | −1.495 | 0.599 | 5.797 | 1.455 | −0.622 | 5.797 |
| −0.106 | −0.258 | 5.797 | −1.456 | 0.577 | 5.797 | 1.487 | −0.631 | 5.797 |
| −0.204 | −0.218 | 5.797 | −1.410 | 0.551 | 5.797 | 1.513 | −0.638 | 5.797 |
| −0.301 | −0.177 | 5.797 | −1.362 | 0.524 | 5.797 | 1.535 | −0.644 | 5.797 |
| −0.397 | −0.133 | 5.797 | −1.308 | 0.493 | 5.797 | 1.552 | −0.648 | 5.797 |
| −0.492 | −0.088 | 5.797 | −1.247 | 0.459 | 5.797 | 1.566 | −0.652 | 5.797 |
| −0.587 | −0.042 | 5.797 | −1.181 | 0.422 | 5.797 | 1.575 | −0.656 | 5.797 |
| −0.681 | 0.006 | 5.797 | −1.111 | 0.384 | 5.797 | 1.579 | −0.664 | 5.797 |
| −0.771 | 0.055 | 5.797 | −1.037 | 0.345 | 5.797 | 1.581 | −0.670 | 5.797 |
| −0.857 | 0.102 | 5.797 | −0.961 | 0.305 | 5.797 | | | |
| −0.940 | 0.150 | 5.797 | −0.880 | 0.264 | 5.797 | | | |

TABLE 9R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.521 | −0.742 | 6.183 | −1.030 | 0.291 | 6.183 | −0.812 | 0.292 | 6.183 |
| 1.520 | −0.747 | 6.183 | −1.101 | 0.344 | 6.183 | −0.729 | 0.242 | 6.183 |
| 1.515 | −0.753 | 6.183 | −1.168 | 0.396 | 6.183 | −0.641 | 0.191 | 6.183 |
| 1.507 | −0.757 | 6.183 | −1.232 | 0.447 | 6.183 | −0.550 | 0.140 | 6.183 |
| 1.497 | −0.757 | 6.183 | −1.293 | 0.496 | 6.183 | −0.459 | 0.090 | 6.183 |
| 1.483 | −0.754 | 6.183 | −1.348 | 0.542 | 6.183 | −0.367 | 0.040 | 6.183 |
| 1.465 | −0.750 | 6.183 | −1.396 | 0.583 | 6.183 | −0.274 | −0.008 | 6.183 |
| 1.442 | −0.746 | 6.183 | −1.438 | 0.621 | 6.183 | −0.181 | −0.055 | 6.183 |
| 1.414 | −0.740 | 6.183 | −1.478 | 0.657 | 6.183 | −0.087 | −0.101 | 6.183 |
| 1.382 | −0.734 | 6.183 | −1.512 | 0.688 | 6.183 | 0.008 | −0.146 | 6.183 |
| 1.343 | −0.726 | 6.183 | −1.537 | 0.713 | 6.183 | 0.102 | −0.189 | 6.183 |
| 1.298 | −0.716 | 6.183 | −1.557 | 0.734 | 6.183 | 0.198 | −0.232 | 6.183 |
| 1.246 | −0.705 | 6.183 | −1.571 | 0.749 | 6.183 | 0.293 | −0.275 | 6.183 |
| 1.187 | −0.693 | 6.183 | −1.580 | 0.763 | 6.183 | 0.389 | −0.317 | 6.183 |
| 1.121 | −0.678 | 6.183 | −1.583 | 0.771 | 6.183 | 0.485 | −0.358 | 6.183 |
| 1.048 | −0.662 | 6.183 | −1.584 | 0.777 | 6.183 | 0.578 | −0.397 | 6.183 |
| 0.968 | −0.643 | 6.183 | −1.583 | 0.779 | 6.183 | 0.668 | −0.434 | 6.183 |
| 0.885 | −0.623 | 6.183 | −1.583 | 0.781 | 6.183 | 0.756 | −0.468 | 6.183 |
| 0.799 | −0.601 | 6.183 | −1.582 | 0.781 | 6.183 | 0.840 | −0.501 | 6.183 |
| 0.710 | −0.577 | 6.183 | −1.582 | 0.782 | 6.183 | 0.922 | −0.532 | 6.183 |
| 0.618 | −0.550 | 6.183 | −1.581 | 0.783 | 6.183 | 1.000 | −0.561 | 6.183 |
| 0.524 | −0.520 | 6.183 | −1.578 | 0.784 | 6.183 | 1.076 | −0.587 | 6.183 |
| 0.427 | −0.488 | 6.183 | −1.572 | 0.784 | 6.183 | 1.145 | −0.610 | 6.183 |
| 0.327 | −0.453 | 6.183 | −1.564 | 0.782 | 6.183 | 1.208 | −0.631 | 6.183 |
| 0.229 | −0.415 | 6.183 | −1.549 | 0.776 | 6.183 | 1.265 | −0.648 | 6.183 |
| 0.131 | −0.375 | 6.183 | −1.531 | 0.765 | 6.183 | 1.315 | −0.664 | 6.183 |
| 0.035 | −0.333 | 6.183 | −1.508 | 0.750 | 6.183 | 1.358 | −0.677 | 6.183 |
| −0.061 | −0.289 | 6.183 | −1.479 | 0.730 | 6.183 | 1.395 | −0.687 | 6.183 |
| −0.155 | −0.243 | 6.183 | −1.442 | 0.705 | 6.183 | 1.427 | −0.696 | 6.183 |
| −0.249 | −0.195 | 6.183 | −1.399 | 0.675 | 6.183 | 1.453 | −0.704 | 6.183 |
| −0.343 | −0.145 | 6.183 | −1.353 | 0.644 | 6.183 | 1.475 | −0.710 | 6.183 |
| −0.435 | −0.094 | 6.183 | −1.301 | 0.608 | 6.183 | 1.493 | −0.715 | 6.183 |
| −0.527 | −0.041 | 6.183 | −1.243 | 0.569 | 6.183 | 1.506 | −0.719 | 6.183 |
| −0.618 | 0.014 | 6.183 | −1.180 | 0.526 | 6.183 | 1.515 | −0.723 | 6.183 |
| −0.708 | 0.070 | 6.183 | −1.113 | 0.482 | 6.183 | 1.520 | −0.730 | 6.183 |
| −0.794 | 0.127 | 6.183 | −1.043 | 0.436 | 6.183 | 1.522 | −0.737 | 6.183 |
| −0.876 | 0.182 | 6.183 | −0.969 | 0.389 | 6.183 | | | |
| −0.955 | 0.237 | 6.183 | −0.893 | 0.341 | 6.183 | | | |

The coordinate values given in TABLE 10R below provide the nominal profile envelope for an exemplary tenth stage rotor.

TABLE 10R

| X-LOC | Y-LOC | Z-LOC | X-LOC | Y-LOC | Z-LOC | X-LOC | Y-LOC | Z-LOC |
|---|---|---|---|---|---|---|---|---|
| 1.803 | −0.224 | 0.000 | −1.149 | −0.123 | 0.000 | −0.859 | 0.090 | 0.000 |
| 1.802 | −0.230 | 0.000 | −1.236 | −0.081 | 0.000 | −0.758 | 0.068 | 0.000 |
| 1.801 | −0.237 | 0.000 | −1.317 | −0.037 | 0.000 | −0.654 | 0.047 | 0.000 |
| 1.797 | −0.246 | 0.000 | −1.394 | 0.007 | 0.000 | −0.545 | 0.028 | 0.000 |
| 1.790 | −0.255 | 0.000 | −1.465 | 0.052 | 0.000 | −0.437 | 0.011 | 0.000 |
| 1.778 | −0.264 | 0.000 | −1.529 | 0.095 | 0.000 | −0.328 | −0.005 | 0.000 |
| 1.759 | −0.268 | 0.000 | −1.585 | 0.136 | 0.000 | −0.219 | −0.019 | 0.000 |
| 1.734 | −0.270 | 0.000 | −1.634 | 0.174 | 0.000 | −0.110 | −0.032 | 0.000 |
| 1.704 | −0.272 | 0.000 | −1.678 | 0.211 | 0.000 | −0.001 | −0.044 | 0.000 |
| 1.668 | −0.275 | 0.000 | −1.714 | 0.246 | 0.000 | 0.109 | −0.055 | 0.000 |
| 1.626 | −0.279 | 0.000 | −1.740 | 0.274 | 0.000 | 0.218 | −0.065 | 0.000 |
| 1.577 | −0.283 | 0.000 | −1.760 | 0.298 | 0.000 | 0.328 | −0.076 | 0.000 |
| 1.520 | −0.288 | 0.000 | −1.772 | 0.317 | 0.000 | 0.437 | −0.086 | 0.000 |
| 1.455 | −0.293 | 0.000 | −1.779 | 0.333 | 0.000 | 0.547 | −0.095 | 0.000 |
| 1.383 | −0.299 | 0.000 | −1.781 | 0.343 | 0.000 | 0.657 | −0.105 | 0.000 |
| 1.303 | −0.306 | 0.000 | −1.780 | 0.349 | 0.000 | 0.762 | −0.114 | 0.000 |
| 1.216 | −0.313 | 0.000 | −1.779 | 0.352 | 0.000 | 0.865 | −0.122 | 0.000 |
| 1.124 | −0.320 | 0.000 | −1.778 | 0.353 | 0.000 | 0.963 | −0.130 | 0.000 |
| 1.029 | −0.327 | 0.000 | −1.778 | 0.354 | 0.000 | 1.059 | −0.138 | 0.000 |
| 0.930 | −0.335 | 0.000 | −1.778 | 0.354 | 0.000 | 1.150 | −0.144 | 0.000 |
| 0.828 | −0.342 | 0.000 | −1.777 | 0.356 | 0.000 | 1.238 | −0.151 | 0.000 |
| 0.721 | −0.349 | 0.000 | −1.774 | 0.358 | 0.000 | 1.322 | −0.156 | 0.000 |
| 0.611 | −0.355 | 0.000 | −1.769 | 0.361 | 0.000 | 1.399 | −0.161 | 0.000 |
| 0.496 | −0.361 | 0.000 | −1.760 | 0.363 | 0.000 | 1.468 | −0.165 | 0.000 |
| 0.382 | −0.365 | 0.000 | −1.744 | 0.364 | 0.000 | 1.530 | −0.169 | 0.000 |
| 0.268 | −0.368 | 0.000 | −1.722 | 0.361 | 0.000 | 1.585 | −0.172 | 0.000 |

TABLE 10R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.154 | −0.369 | 0.000 | −1.693 | 0.355 | 0.000 | 1.633 | −0.175 | 0.000 |
| 0.040 | −0.368 | 0.000 | −1.658 | 0.345 | 0.000 | 1.673 | −0.177 | 0.000 |
| −0.074 | −0.365 | 0.000 | −1.613 | 0.329 | 0.000 | 1.708 | −0.179 | 0.000 |
| −0.188 | −0.359 | 0.000 | −1.561 | 0.311 | 0.000 | 1.737 | −0.181 | 0.000 |
| −0.301 | −0.350 | 0.000 | −1.506 | 0.290 | 0.000 | 1.760 | −0.182 | 0.000 |
| −0.415 | −0.336 | 0.000 | −1.444 | 0.267 | 0.000 | 1.779 | −0.186 | 0.000 |
| −0.528 | −0.319 | 0.000 | −1.375 | 0.242 | 0.000 | 1.791 | −0.195 | 0.000 |
| −0.641 | −0.296 | 0.000 | −1.299 | 0.216 | 0.000 | 1.797 | −0.203 | 0.000 |
| −0.753 | −0.269 | 0.000 | −1.219 | 0.190 | 0.000 | 1.801 | −0.212 | 0.000 |
| −0.860 | −0.237 | 0.000 | −1.135 | 0.164 | 0.000 | 1.802 | −0.219 | 0.000 |
| −0.961 | −0.202 | 0.000 | −1.047 | 0.138 | 0.000 | | | |
| −1.058 | −0.164 | 0.000 | −0.955 | 0.113 | 0.000 | | | |
| 1.680 | −0.234 | 0.569 | −1.125 | −0.104 | 0.569 | −0.861 | 0.106 | 0.569 |
| 1.679 | −0.239 | 0.569 | −1.209 | −0.069 | 0.569 | −0.765 | 0.087 | 0.569 |
| 1.678 | −0.246 | 0.569 | −1.289 | −0.032 | 0.569 | −0.665 | 0.069 | 0.569 |
| 1.674 | −0.254 | 0.569 | −1.364 | 0.005 | 0.569 | −0.561 | 0.051 | 0.569 |
| 1.667 | −0.263 | 0.569 | −1.435 | 0.043 | 0.569 | −0.457 | 0.035 | 0.569 |
| 1.656 | −0.271 | 0.569 | −1.498 | 0.079 | 0.569 | −0.353 | 0.019 | 0.569 |
| 1.638 | −0.275 | 0.569 | −1.554 | 0.114 | 0.569 | −0.249 | 0.005 | 0.569 |
| 1.614 | −0.276 | 0.569 | −1.603 | 0.146 | 0.569 | −0.145 | −0.009 | 0.569 |
| 1.586 | −0.278 | 0.569 | −1.648 | 0.178 | 0.569 | −0.040 | −0.022 | 0.569 |
| 1.552 | −0.279 | 0.569 | −1.685 | 0.207 | 0.569 | 0.064 | −0.034 | 0.569 |
| 1.512 | −0.281 | 0.569 | −1.712 | 0.232 | 0.569 | 0.169 | −0.046 | 0.569 |
| 1.465 | −0.283 | 0.569 | −1.732 | 0.253 | 0.569 | 0.273 | −0.058 | 0.569 |
| 1.411 | −0.286 | 0.569 | −1.745 | 0.271 | 0.569 | 0.378 | −0.070 | 0.569 |
| 1.350 | −0.288 | 0.569 | −1.753 | 0.285 | 0.569 | 0.483 | −0.082 | 0.569 |
| 1.281 | −0.291 | 0.569 | −1.755 | 0.294 | 0.569 | 0.587 | −0.093 | 0.569 |
| 1.205 | −0.294 | 0.569 | −1.755 | 0.300 | 0.569 | 0.688 | −0.104 | 0.569 |
| 1.122 | −0.298 | 0.569 | −1.754 | 0.303 | 0.569 | 0.786 | −0.114 | 0.569 |
| 1.036 | −0.301 | 0.569 | −1.754 | 0.304 | 0.569 | 0.880 | −0.124 | 0.569 |
| 0.945 | −0.305 | 0.569 | −1.754 | 0.305 | 0.569 | 0.971 | −0.133 | 0.569 |
| 0.851 | −0.308 | 0.569 | −1.753 | 0.305 | 0.569 | 1.058 | −0.141 | 0.569 |
| 0.754 | −0.311 | 0.569 | −1.752 | 0.307 | 0.569 | 1.142 | −0.149 | 0.569 |
| 0.653 | −0.314 | 0.569 | −1.751 | 0.309 | 0.569 | 1.223 | −0.156 | 0.569 |
| 0.548 | −0.316 | 0.569 | −1.746 | 0.312 | 0.569 | 1.296 | −0.162 | 0.569 |
| 0.440 | −0.318 | 0.569 | −1.738 | 0.315 | 0.569 | 1.362 | −0.168 | 0.569 |
| 0.331 | −0.319 | 0.569 | −1.722 | 0.317 | 0.569 | 1.422 | −0.173 | 0.569 |
| 0.223 | −0.318 | 0.569 | −1.701 | 0.317 | 0.569 | 1.474 | −0.178 | 0.569 |
| 0.115 | −0.317 | 0.569 | −1.673 | 0.313 | 0.569 | 1.520 | −0.181 | 0.569 |
| 0.007 | −0.314 | 0.569 | −1.638 | 0.306 | 0.569 | 1.558 | −0.184 | 0.569 |
| −0.101 | −0.309 | 0.569 | −1.594 | 0.296 | 0.569 | 1.591 | −0.187 | 0.569 |
| −0.208 | −0.302 | 0.569 | −1.543 | 0.282 | 0.569 | 1.619 | −0.189 | 0.569 |
| −0.316 | −0.293 | 0.569 | −1.489 | 0.266 | 0.569 | 1.641 | −0.191 | 0.569 |
| −0.423 | −0.281 | 0.569 | −1.429 | 0.248 | 0.569 | 1.659 | −0.196 | 0.569 |
| −0.530 | −0.266 | 0.569 | −1.361 | 0.229 | 0.569 | 1.669 | −0.205 | 0.569 |
| −0.636 | −0.247 | 0.569 | −1.287 | 0.208 | 0.569 | 1.675 | −0.213 | 0.569 |
| −0.743 | −0.225 | 0.569 | −1.209 | 0.187 | 0.569 | 1.678 | −0.221 | 0.569 |
| −0.845 | −0.198 | 0.569 | −1.128 | 0.166 | 0.569 | 1.680 | −0.228 | 0.569 |
| −0.943 | −0.169 | 0.569 | −1.042 | 0.146 | 0.569 | | | |
| −1.036 | −0.138 | 0.569 | −0.954 | 0.126 | 0.569 | | | |
| 1.622 | −0.309 | 1.208 | −1.120 | −0.065 | 1.208 | −0.872 | 0.121 | 1.208 |
| 1.621 | −0.314 | 1.208 | −1.204 | −0.033 | 1.208 | −0.777 | 0.102 | 1.208 |
| 1.619 | −0.321 | 1.208 | −1.283 | −0.001 | 1.208 | −0.678 | 0.083 | 1.208 |
| 1.615 | −0.328 | 1.208 | −1.358 | 0.032 | 1.208 | −0.576 | 0.063 | 1.208 |
| 1.607 | −0.336 | 1.208 | −1.429 | 0.066 | 1.208 | −0.474 | 0.045 | 1.208 |
| 1.595 | −0.342 | 1.208 | −1.493 | 0.098 | 1.208 | −0.372 | 0.027 | 1.208 |
| 1.577 | −0.343 | 1.208 | −1.550 | 0.128 | 1.208 | −0.270 | 0.010 | 1.208 |
| 1.554 | −0.343 | 1.208 | −1.599 | 0.157 | 1.208 | −0.167 | −0.007 | 1.208 |
| 1.526 | −0.342 | 1.208 | −1.645 | 0.185 | 1.208 | −0.065 | −0.023 | 1.208 |
| 1.493 | −0.341 | 1.208 | −1.683 | 0.211 | 1.208 | 0.038 | −0.040 | 1.208 |
| 1.454 | −0.340 | 1.208 | −1.711 | 0.234 | 1.208 | 0.140 | −0.056 | 1.208 |
| 1.408 | −0.339 | 1.208 | −1.731 | 0.253 | 1.208 | 0.243 | −0.072 | 1.208 |
| 1.355 | −0.338 | 1.208 | −1.745 | 0.270 | 1.208 | 0.345 | −0.088 | 1.208 |
| 1.295 | −0.336 | 1.208 | −1.753 | 0.283 | 1.208 | 0.448 | −0.104 | 1.208 |
| 1.228 | −0.334 | 1.208 | −1.756 | 0.292 | 1.208 | 0.550 | −0.120 | 1.208 |
| 1.154 | −0.332 | 1.208 | −1.756 | 0.298 | 1.208 | 0.650 | −0.135 | 1.208 |
| 1.073 | −0.329 | 1.208 | −1.756 | 0.300 | 1.208 | 0.745 | −0.150 | 1.208 |
| 0.988 | −0.327 | 1.208 | −1.755 | 0.302 | 1.208 | 0.838 | −0.164 | 1.208 |
| 0.900 | −0.324 | 1.208 | −1.755 | 0.302 | 1.208 | 0.927 | −0.177 | 1.208 |
| 0.809 | −0.321 | 1.208 | −1.755 | 0.303 | 1.208 | 1.012 | −0.190 | 1.208 |
| 0.714 | −0.317 | 1.208 | −1.754 | 0.304 | 1.208 | 1.094 | −0.201 | 1.208 |
| 0.615 | −0.313 | 1.208 | −1.752 | 0.306 | 1.208 | 1.173 | −0.212 | 1.208 |
| 0.513 | −0.309 | 1.208 | −1.748 | 0.310 | 1.208 | 1.245 | −0.222 | 1.208 |
| 0.407 | −0.304 | 1.208 | −1.740 | 0.313 | 1.208 | 1.310 | −0.231 | 1.208 |
| 0.301 | −0.298 | 1.208 | −1.724 | 0.316 | 1.208 | 1.369 | −0.239 | 1.208 |
| 0.196 | −0.292 | 1.208 | −1.703 | 0.316 | 1.208 | 1.420 | −0.246 | 1.208 |
| 0.091 | −0.285 | 1.208 | −1.676 | 0.314 | 1.208 | 1.465 | −0.252 | 1.208 |

TABLE 10R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.015 | −0.276 | 1.208 | −1.642 | 0.308 | 1.208 | 1.502 | −0.257 | 1.208 |
| −0.120 | −0.267 | 1.208 | −1.598 | 0.299 | 1.208 | 1.535 | −0.262 | 1.208 |
| −0.225 | −0.257 | 1.208 | −1.547 | 0.286 | 1.208 | 1.562 | −0.265 | 1.208 |
| −0.329 | −0.244 | 1.208 | −1.494 | 0.272 | 1.208 | 1.584 | −0.268 | 1.208 |
| −0.434 | −0.230 | 1.208 | −1.434 | 0.255 | 1.208 | 1.601 | −0.272 | 1.208 |
| −0.538 | −0.214 | 1.208 | −1.367 | 0.237 | 1.208 | 1.612 | −0.280 | 1.208 |
| −0.642 | −0.195 | 1.208 | −1.293 | 0.218 | 1.208 | 1.618 | −0.289 | 1.208 |
| −0.745 | −0.173 | 1.208 | −1.216 | 0.199 | 1.208 | 1.621 | −0.297 | 1.208 |
| −0.845 | −0.149 | 1.208 | −1.135 | 0.179 | 1.208 | 1.622 | −0.304 | 1.208 |
| −0.940 | −0.123 | 1.208 | −1.051 | 0.160 | 1.208 | | | |
| −1.032 | −0.095 | 1.208 | −0.963 | 0.140 | 1.208 | | | |
| 1.611 | −0.467 | 1.847 | −1.105 | −0.026 | 1.847 | −0.859 | 0.112 | 1.847 |
| 1.610 | −0.472 | 1.847 | −1.187 | 0.005 | 1.847 | −0.765 | 0.089 | 1.847 |
| 1.607 | −0.479 | 1.847 | −1.265 | 0.037 | 1.847 | −0.668 | 0.065 | 1.847 |
| 1.601 | −0.485 | 1.847 | −1.339 | 0.069 | 1.847 | −0.567 | 0.041 | 1.847 |
| 1.592 | −0.491 | 1.847 | −1.409 | 0.101 | 1.847 | −0.465 | 0.017 | 1.847 |
| 1.578 | −0.492 | 1.847 | −1.473 | 0.131 | 1.847 | −0.364 | −0.006 | 1.847 |
| 1.560 | −0.490 | 1.847 | −1.529 | 0.160 | 1.847 | −0.263 | −0.029 | 1.847 |
| 1.537 | −0.488 | 1.847 | −1.579 | 0.187 | 1.847 | −0.162 | −0.052 | 1.847 |
| 1.510 | −0.484 | 1.847 | −1.624 | 0.214 | 1.847 | −0.060 | −0.075 | 1.847 |
| 1.477 | −0.481 | 1.847 | −1.662 | 0.239 | 1.847 | 0.041 | −0.098 | 1.847 |
| 1.438 | −0.476 | 1.847 | −1.690 | 0.260 | 1.847 | 0.142 | −0.120 | 1.847 |
| 1.393 | −0.471 | 1.847 | −1.711 | 0.278 | 1.847 | 0.244 | −0.143 | 1.847 |
| 1.341 | −0.465 | 1.847 | −1.725 | 0.294 | 1.847 | 0.345 | −0.166 | 1.847 |
| 1.281 | −0.458 | 1.847 | −1.734 | 0.307 | 1.847 | 0.447 | −0.189 | 1.847 |
| 1.215 | −0.450 | 1.847 | −1.737 | 0.315 | 1.847 | 0.548 | −0.211 | 1.847 |
| 1.142 | −0.442 | 1.847 | −1.738 | 0.321 | 1.847 | 0.646 | −0.233 | 1.847 |
| 1.062 | −0.432 | 1.847 | −1.737 | 0.324 | 1.847 | 0.741 | −0.254 | 1.847 |
| 0.978 | −0.422 | 1.847 | −1.737 | 0.325 | 1.847 | 0.832 | −0.274 | 1.847 |
| 0.891 | −0.411 | 1.847 | −1.737 | 0.326 | 1.847 | 0.920 | −0.294 | 1.847 |
| 0.800 | −0.400 | 1.847 | −1.736 | 0.326 | 1.847 | 1.005 | −0.312 | 1.847 |
| 0.706 | −0.388 | 1.847 | −1.735 | 0.328 | 1.847 | 1.086 | −0.329 | 1.847 |
| 0.609 | −0.376 | 1.847 | −1.734 | 0.330 | 1.847 | 1.164 | −0.346 | 1.847 |
| 0.508 | −0.363 | 1.847 | −1.729 | 0.333 | 1.847 | 1.235 | −0.361 | 1.847 |
| 0.403 | −0.349 | 1.847 | −1.721 | 0.335 | 1.847 | 1.299 | −0.374 | 1.847 |
| 0.299 | −0.335 | 1.847 | −1.705 | 0.337 | 1.847 | 1.357 | −0.386 | 1.847 |
| 0.195 | −0.320 | 1.847 | −1.684 | 0.336 | 1.847 | 1.408 | −0.397 | 1.847 |
| 0.090 | −0.304 | 1.847 | −1.657 | 0.332 | 1.847 | 1.452 | −0.406 | 1.847 |
| −0.014 | −0.288 | 1.847 | −1.623 | 0.325 | 1.847 | 1.489 | −0.414 | 1.847 |
| −0.118 | −0.271 | 1.847 | −1.579 | 0.314 | 1.847 | 1.521 | −0.420 | 1.847 |
| −0.222 | −0.253 | 1.847 | −1.530 | 0.299 | 1.847 | 1.548 | −0.426 | 1.847 |
| −0.325 | −0.233 | 1.847 | −1.477 | 0.283 | 1.847 | 1.570 | −0.430 | 1.847 |
| −0.428 | −0.213 | 1.847 | −1.417 | 0.265 | 1.847 | 1.588 | −0.434 | 1.847 |
| −0.531 | −0.191 | 1.847 | −1.351 | 0.245 | 1.847 | 1.600 | −0.439 | 1.847 |
| −0.634 | −0.167 | 1.847 | −1.278 | 0.224 | 1.847 | 1.607 | −0.447 | 1.847 |
| −0.736 | −0.142 | 1.847 | −1.201 | 0.202 | 1.847 | 1.610 | −0.455 | 1.847 |
| −0.834 | −0.115 | 1.847 | −1.121 | 0.180 | 1.847 | 1.611 | −0.462 | 1.847 |
| −0.928 | −0.086 | 1.847 | −1.037 | 0.157 | 1.847 | | | |
| −1.019 | −0.057 | 1.847 | −0.950 | 0.135 | 1.847 | | | |
| 1.612 | −0.546 | 2.166 | −1.085 | −0.022 | 2.166 | −0.846 | 0.096 | 2.166 |
| 1.611 | −0.551 | 2.166 | −1.167 | 0.009 | 2.166 | −0.752 | 0.070 | 2.166 |
| 1.608 | −0.557 | 2.166 | −1.245 | 0.041 | 2.166 | −0.655 | 0.045 | 2.166 |
| 1.601 | −0.563 | 2.166 | −1.320 | 0.073 | 2.166 | −0.555 | 0.018 | 2.166 |
| 1.591 | −0.567 | 2.166 | −1.390 | 0.105 | 2.166 | −0.454 | −0.008 | 2.166 |
| 1.577 | −0.566 | 2.166 | −1.453 | 0.136 | 2.166 | −0.353 | −0.034 | 2.166 |
| 1.559 | −0.563 | 2.166 | −1.510 | 0.164 | 2.166 | −0.253 | −0.060 | 2.166 |
| 1.537 | −0.560 | 2.166 | −1.560 | 0.191 | 2.166 | −0.152 | −0.085 | 2.166 |
| 1.509 | −0.556 | 2.166 | −1.605 | 0.217 | 2.166 | −0.051 | −0.111 | 2.166 |
| 1.477 | −0.551 | 2.166 | −1.644 | 0.242 | 2.166 | 0.050 | −0.137 | 2.166 |
| 1.439 | −0.545 | 2.166 | −1.672 | 0.263 | 2.166 | 0.151 | −0.162 | 2.166 |
| 1.394 | −0.538 | 2.166 | −1.693 | 0.281 | 2.166 | 0.251 | −0.188 | 2.166 |
| 1.342 | −0.531 | 2.166 | −1.708 | 0.296 | 2.166 | 0.352 | −0.213 | 2.166 |
| 1.283 | −0.522 | 2.166 | −1.717 | 0.309 | 2.166 | 0.453 | −0.239 | 2.166 |
| 1.217 | −0.512 | 2.166 | −1.720 | 0.317 | 2.166 | 0.554 | −0.264 | 2.166 |
| 1.144 | −0.501 | 2.166 | −1.721 | 0.323 | 2.166 | 0.651 | −0.289 | 2.166 |
| 1.065 | −0.488 | 2.166 | −1.721 | 0.326 | 2.166 | 0.745 | −0.312 | 2.166 |
| 0.982 | −0.475 | 2.166 | −1.720 | 0.327 | 2.166 | 0.836 | −0.335 | 2.166 |
| 0.895 | −0.462 | 2.166 | −1.720 | 0.328 | 2.166 | 0.924 | −0.356 | 2.166 |
| 0.805 | −0.448 | 2.166 | −1.720 | 0.328 | 2.166 | 1.008 | −0.377 | 2.166 |
| 0.712 | −0.433 | 2.166 | −1.719 | 0.329 | 2.166 | 1.089 | −0.397 | 2.166 |
| 0.615 | −0.417 | 2.166 | −1.717 | 0.332 | 2.166 | 1.166 | −0.415 | 2.166 |
| 0.515 | −0.401 | 2.166 | −1.712 | 0.334 | 2.166 | 1.237 | −0.432 | 2.166 |
| 0.411 | −0.383 | 2.166 | −1.704 | 0.337 | 2.166 | 1.301 | −0.447 | 2.166 |
| 0.308 | −0.365 | 2.166 | −1.688 | 0.338 | 2.166 | 1.358 | −0.461 | 2.166 |
| 0.205 | −0.347 | 2.166 | −1.667 | 0.336 | 2.166 | 1.409 | −0.473 | 2.166 |
| 0.101 | −0.328 | 2.166 | −1.640 | 0.332 | 2.166 | 1.453 | −0.483 | 2.166 |
| −0.002 | −0.308 | 2.166 | −1.606 | 0.324 | 2.166 | 1.490 | −0.492 | 2.166 |

TABLE 10R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.105 | −0.288 | 2.166 | −1.563 | 0.312 | 2.166 | 1.522 | −0.499 | 2.166 |
| −0.207 | −0.267 | 2.166 | −1.513 | 0.296 | 2.166 | 1.548 | −0.505 | 2.166 |
| −0.310 | −0.245 | 2.166 | −1.461 | 0.279 | 2.166 | 1.570 | −0.511 | 2.166 |
| −0.412 | −0.221 | 2.166 | −1.401 | 0.259 | 2.166 | 1.588 | −0.515 | 2.166 |
| −0.514 | −0.197 | 2.166 | −1.335 | 0.238 | 2.166 | 1.601 | −0.519 | 2.166 |
| −0.616 | −0.171 | 2.166 | −1.262 | 0.216 | 2.166 | 1.608 | −0.526 | 2.166 |
| −0.718 | −0.143 | 2.166 | −1.186 | 0.193 | 2.166 | 1.612 | −0.534 | 2.166 |
| −0.815 | −0.114 | 2.166 | −1.106 | 0.169 | 2.166 | 1.613 | −0.541 | 2.166 |
| −0.909 | −0.084 | 2.166 | −1.023 | 0.145 | 2.166 | | | |
| −0.999 | −0.054 | 2.166 | −0.936 | 0.121 | 2.166 | | | |
| 1.620 | −0.661 | 2.805 | −1.062 | −0.041 | 2.805 | −0.826 | 0.051 | 2.805 |
| 1.618 | −0.666 | 2.805 | −1.144 | −0.009 | 2.805 | −0.733 | 0.023 | 2.805 |
| 1.614 | −0.672 | 2.805 | −1.221 | 0.024 | 2.805 | −0.637 | −0.006 | 2.805 |
| 1.607 | −0.677 | 2.805 | −1.295 | 0.056 | 2.805 | −0.537 | −0.035 | 2.805 |
| 1.596 | −0.678 | 2.805 | −1.365 | 0.088 | 2.805 | −0.437 | −0.065 | 2.805 |
| 1.582 | −0.676 | 2.805 | −1.429 | 0.118 | 2.805 | −0.337 | −0.094 | 2.805 |
| 1.564 | −0.672 | 2.805 | −1.485 | 0.146 | 2.805 | −0.237 | −0.123 | 2.805 |
| 1.542 | −0.668 | 2.805 | −1.535 | 0.173 | 2.805 | −0.137 | −0.152 | 2.805 |
| 1.515 | −0.664 | 2.805 | −1.580 | 0.199 | 2.805 | −0.037 | −0.180 | 2.805 |
| 1.482 | −0.658 | 2.805 | −1.619 | 0.224 | 2.805 | 0.063 | −0.209 | 2.805 |
| 1.444 | −0.651 | 2.805 | −1.647 | 0.244 | 2.805 | 0.163 | −0.238 | 2.805 |
| 1.400 | −0.643 | 2.805 | −1.668 | 0.263 | 2.805 | 0.263 | −0.267 | 2.805 |
| 1.348 | −0.633 | 2.805 | −1.683 | 0.278 | 2.805 | 0.364 | −0.296 | 2.805 |
| 1.289 | −0.622 | 2.805 | −1.692 | 0.290 | 2.805 | 0.464 | −0.325 | 2.805 |
| 1.224 | −0.610 | 2.805 | −1.696 | 0.298 | 2.805 | 0.564 | −0.353 | 2.805 |
| 1.151 | −0.596 | 2.805 | −1.697 | 0.304 | 2.805 | 0.661 | −0.381 | 2.805 |
| 1.072 | −0.581 | 2.805 | −1.696 | 0.307 | 2.805 | 0.754 | −0.407 | 2.805 |
| 0.990 | −0.566 | 2.805 | −1.696 | 0.308 | 2.805 | 0.844 | −0.433 | 2.805 |
| 0.904 | −0.549 | 2.805 | −1.696 | 0.309 | 2.805 | 0.931 | −0.457 | 2.805 |
| 0.814 | −0.532 | 2.805 | −1.695 | 0.309 | 2.805 | 1.015 | −0.480 | 2.805 |
| 0.721 | −0.513 | 2.805 | −1.694 | 0.310 | 2.805 | 1.096 | −0.502 | 2.805 |
| 0.625 | −0.494 | 2.805 | −1.692 | 0.312 | 2.805 | 1.173 | −0.523 | 2.805 |
| 0.526 | −0.474 | 2.805 | −1.687 | 0.315 | 2.805 | 1.243 | −0.541 | 2.805 |
| 0.423 | −0.452 | 2.805 | −1.679 | 0.317 | 2.805 | 1.307 | −0.558 | 2.805 |
| 0.320 | −0.430 | 2.805 | −1.663 | 0.317 | 2.805 | 1.364 | −0.574 | 2.805 |
| 0.217 | −0.407 | 2.805 | −1.642 | 0.314 | 2.805 | 1.414 | −0.587 | 2.805 |
| 0.115 | −0.384 | 2.805 | −1.615 | 0.308 | 2.805 | 1.458 | −0.598 | 2.805 |
| 0.012 | −0.361 | 2.805 | −1.582 | 0.299 | 2.805 | 1.495 | −0.608 | 2.805 |
| −0.090 | −0.336 | 2.805 | −1.539 | 0.285 | 2.805 | 1.526 | −0.616 | 2.805 |
| −0.192 | −0.311 | 2.805 | −1.490 | 0.268 | 2.805 | 1.553 | −0.623 | 2.805 |
| −0.294 | −0.285 | 2.805 | −1.437 | 0.249 | 2.805 | 1.575 | −0.629 | 2.805 |
| −0.396 | −0.258 | 2.805 | −1.378 | 0.229 | 2.805 | 1.592 | −0.633 | 2.805 |
| −0.497 | −0.229 | 2.805 | −1.313 | 0.206 | 2.805 | 1.606 | −0.637 | 2.805 |
| −0.598 | −0.200 | 2.805 | −1.240 | 0.182 | 2.805 | 1.614 | −0.642 | 2.805 |
| −0.698 | −0.169 | 2.805 | −1.165 | 0.157 | 2.805 | 1.619 | −0.650 | 2.805 |
| −0.795 | −0.138 | 2.805 | −1.085 | 0.131 | 2.805 | 1.620 | −0.656 | 2.805 |
| −0.888 | −0.106 | 2.805 | −1.002 | 0.105 | 2.805 | | | |
| −0.977 | −0.074 | 2.805 | −0.916 | 0.078 | 2.805 | | | |
| 1.620 | −0.729 | 3.444 | −1.058 | −0.078 | 3.444 | −0.827 | 0.000 | 3.444 |
| 1.618 | −0.734 | 3.444 | −1.139 | −0.045 | 3.444 | −0.734 | −0.030 | 3.444 |
| 1.614 | −0.740 | 3.444 | −1.217 | −0.012 | 3.444 | −0.638 | −0.059 | 3.444 |
| 1.606 | −0.744 | 3.444 | −1.292 | 0.021 | 3.444 | −0.538 | −0.090 | 3.444 |
| 1.596 | −0.744 | 3.444 | −1.362 | 0.053 | 3.444 | −0.438 | −0.120 | 3.444 |
| 1.582 | −0.742 | 3.444 | −1.426 | 0.084 | 3.444 | −0.339 | −0.150 | 3.444 |
| 1.564 | −0.739 | 3.444 | −1.483 | 0.112 | 3.444 | −0.239 | −0.181 | 3.444 |
| 1.541 | −0.735 | 3.444 | −1.533 | 0.139 | 3.444 | −0.139 | −0.210 | 3.444 |
| 1.514 | −0.730 | 3.444 | −1.578 | 0.166 | 3.444 | −0.039 | −0.240 | 3.444 |
| 1.482 | −0.724 | 3.444 | −1.617 | 0.192 | 3.444 | 0.061 | −0.270 | 3.444 |
| 1.444 | −0.717 | 3.444 | −1.645 | 0.213 | 3.444 | 0.161 | −0.300 | 3.444 |
| 1.399 | −0.708 | 3.444 | −1.666 | 0.231 | 3.444 | 0.261 | −0.330 | 3.444 |
| 1.347 | −0.699 | 3.444 | −1.681 | 0.247 | 3.444 | 0.361 | −0.359 | 3.444 |
| 1.288 | −0.688 | 3.444 | −1.690 | 0.260 | 3.444 | 0.461 | −0.389 | 3.444 |
| 1.223 | −0.675 | 3.444 | −1.694 | 0.268 | 3.444 | 0.562 | −0.418 | 3.444 |
| 1.150 | −0.661 | 3.444 | −1.694 | 0.273 | 3.444 | 0.658 | −0.446 | 3.444 |
| 1.071 | −0.645 | 3.444 | −1.694 | 0.276 | 3.444 | 0.752 | −0.473 | 3.444 |
| 0.988 | −0.629 | 3.444 | −1.694 | 0.278 | 3.444 | 0.842 | −0.499 | 3.444 |
| 0.902 | −0.612 | 3.444 | −1.693 | 0.278 | 3.444 | 0.929 | −0.524 | 3.444 |
| 0.813 | −0.593 | 3.444 | −1.693 | 0.279 | 3.444 | 1.013 | −0.547 | 3.444 |
| 0.720 | −0.574 | 3.444 | −1.692 | 0.280 | 3.444 | 1.093 | −0.570 | 3.444 |
| 0.624 | −0.554 | 3.444 | −1.690 | 0.282 | 3.444 | 1.171 | −0.591 | 3.444 |
| 0.524 | −0.532 | 3.444 | −1.684 | 0.283 | 3.444 | 1.241 | −0.610 | 3.444 |
| 0.421 | −0.510 | 3.444 | −1.676 | 0.284 | 3.444 | 1.305 | −0.627 | 3.444 |
| 0.319 | −0.486 | 3.444 | −1.660 | 0.283 | 3.444 | 1.362 | −0.642 | 3.444 |
| 0.216 | −0.462 | 3.444 | −1.640 | 0.279 | 3.444 | 1.413 | −0.655 | 3.444 |
| 0.114 | −0.438 | 3.444 | −1.613 | 0.271 | 3.444 | 1.456 | −0.667 | 3.444 |
| 0.012 | −0.413 | 3.444 | −1.580 | 0.261 | 3.444 | 1.493 | −0.676 | 3.444 |
| −0.090 | −0.387 | 3.444 | −1.537 | 0.245 | 3.444 | 1.525 | −0.685 | 3.444 |

TABLE 10R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.191 | −0.360 | 3.444 | −1.488 | 0.227 | 3.444 | 1.552 | −0.691 | 3.444 |
| −0.293 | −0.332 | 3.444 | −1.436 | 0.207 | 3.444 | 1.574 | −0.697 | 3.444 |
| −0.394 | −0.303 | 3.444 | −1.378 | 0.185 | 3.444 | 1.591 | −0.701 | 3.444 |
| −0.495 | −0.274 | 3.444 | −1.312 | 0.161 | 3.444 | 1.605 | −0.705 | 3.444 |
| −0.595 | −0.243 | 3.444 | −1.240 | 0.136 | 3.444 | 1.614 | −0.710 | 3.444 |
| −0.695 | −0.210 | 3.444 | −1.165 | 0.110 | 3.444 | 1.619 | −0.717 | 3.444 |
| −0.791 | −0.177 | 3.444 | −1.085 | 0.083 | 3.444 | 1.620 | −0.724 | 3.444 |
| −0.884 | −0.144 | 3.444 | −1.003 | 0.056 | 3.444 | | | |
| −0.972 | −0.111 | 3.444 | −0.917 | 0.028 | 3.444 | | | |
| 1.602 | −0.775 | 4.083 | −1.077 | −0.105 | 4.083 | −0.851 | −0.047 | 4.083 |
| 1.600 | −0.780 | 4.083 | −1.159 | −0.071 | 4.083 | −0.759 | −0.078 | 4.083 |
| 1.596 | −0.785 | 4.083 | −1.237 | −0.038 | 4.083 | −0.662 | −0.108 | 4.083 |
| 1.588 | −0.790 | 4.083 | −1.311 | −0.005 | 4.083 | −0.563 | −0.140 | 4.083 |
| 1.578 | −0.790 | 4.083 | −1.382 | 0.028 | 4.083 | −0.463 | −0.171 | 4.083 |
| 1.564 | −0.787 | 4.083 | −1.445 | 0.058 | 4.083 | −0.363 | −0.201 | 4.083 |
| 1.546 | −0.784 | 4.083 | −1.502 | 0.087 | 4.083 | −0.263 | −0.232 | 4.083 |
| 1.523 | −0.780 | 4.083 | −1.552 | 0.114 | 4.083 | −0.162 | −0.262 | 4.083 |
| 1.496 | −0.775 | 4.083 | −1.598 | 0.141 | 4.083 | −0.062 | −0.292 | 4.083 |
| 1.463 | −0.769 | 4.083 | −1.636 | 0.166 | 4.083 | 0.038 | −0.322 | 4.083 |
| 1.425 | −0.763 | 4.083 | −1.665 | 0.187 | 4.083 | 0.138 | −0.352 | 4.083 |
| 1.380 | −0.754 | 4.083 | −1.686 | 0.205 | 4.083 | 0.239 | −0.381 | 4.083 |
| 1.328 | −0.745 | 4.083 | −1.701 | 0.221 | 4.083 | 0.339 | −0.411 | 4.083 |
| 1.269 | −0.734 | 4.083 | −1.710 | 0.234 | 4.083 | 0.439 | −0.441 | 4.083 |
| 1.204 | −0.721 | 4.083 | −1.714 | 0.242 | 4.083 | 0.540 | −0.470 | 4.083 |
| 1.131 | −0.707 | 4.083 | −1.715 | 0.247 | 4.083 | 0.637 | −0.498 | 4.083 |
| 1.052 | −0.692 | 4.083 | −1.714 | 0.250 | 4.083 | 0.731 | −0.525 | 4.083 |
| 0.969 | −0.675 | 4.083 | −1.714 | 0.251 | 4.083 | 0.821 | −0.550 | 4.083 |
| 0.882 | −0.658 | 4.083 | −1.714 | 0.252 | 4.083 | 0.909 | −0.575 | 4.083 |
| 0.793 | −0.640 | 4.083 | −1.713 | 0.252 | 4.083 | 0.993 | −0.598 | 4.083 |
| 0.700 | −0.620 | 4.083 | −1.712 | 0.254 | 4.083 | 1.073 | −0.620 | 4.083 |
| 0.603 | −0.599 | 4.083 | −1.710 | 0.255 | 4.083 | 1.151 | −0.640 | 4.083 |
| 0.504 | −0.577 | 4.083 | −1.704 | 0.256 | 4.083 | 1.222 | −0.659 | 4.083 |
| 0.401 | −0.554 | 4.083 | −1.696 | 0.256 | 4.083 | 1.286 | −0.676 | 4.083 |
| 0.298 | −0.529 | 4.083 | −1.680 | 0.254 | 4.083 | 1.343 | −0.690 | 4.083 |
| 0.196 | −0.504 | 4.083 | −1.660 | 0.249 | 4.083 | 1.394 | −0.703 | 4.083 |
| 0.094 | −0.479 | 4.083 | −1.633 | 0.240 | 4.083 | 1.438 | −0.714 | 4.083 |
| −0.008 | −0.452 | 4.083 | −1.601 | 0.228 | 4.083 | 1.475 | −0.724 | 4.083 |
| −0.110 | −0.425 | 4.083 | −1.559 | 0.211 | 4.083 | 1.507 | −0.732 | 4.083 |
| −0.211 | −0.397 | 4.083 | −1.510 | 0.191 | 4.083 | 1.534 | −0.738 | 4.083 |
| −0.313 | −0.368 | 4.083 | −1.459 | 0.170 | 4.083 | 1.556 | −0.744 | 4.083 |
| −0.414 | −0.338 | 4.083 | −1.400 | 0.147 | 4.083 | 1.573 | −0.748 | 4.083 |
| −0.514 | −0.307 | 4.083 | −1.335 | 0.122 | 4.083 | 1.587 | −0.751 | 4.083 |
| −0.614 | −0.274 | 4.083 | −1.263 | 0.095 | 4.083 | 1.596 | −0.756 | 4.083 |
| −0.714 | −0.240 | 4.083 | −1.188 | 0.068 | 4.083 | 1.601 | −0.763 | 4.083 |
| −0.810 | −0.206 | 4.083 | −1.109 | 0.040 | 4.083 | 1.603 | −0.769 | 4.083 |
| −0.903 | −0.172 | 4.083 | −1.027 | 0.011 | 4.083 | | | |
| −0.992 | −0.138 | 4.083 | −0.941 | −0.018 | 4.083 | | | |
| 1.571 | −0.792 | 4.722 | −1.118 | −0.117 | 4.722 | −0.898 | −0.077 | 4.722 |
| 1.569 | −0.797 | 4.722 | −1.200 | −0.083 | 4.722 | −0.806 | −0.109 | 4.722 |
| 1.565 | −0.803 | 4.722 | −1.278 | −0.049 | 4.722 | −0.709 | −0.140 | 4.722 |
| 1.557 | −0.807 | 4.722 | −1.352 | −0.015 | 4.722 | −0.609 | −0.172 | 4.722 |
| 1.547 | −0.807 | 4.722 | −1.423 | 0.018 | 4.722 | −0.509 | −0.204 | 4.722 |
| 1.533 | −0.805 | 4.722 | −1.487 | 0.049 | 4.722 | −0.408 | −0.234 | 4.722 |
| 1.514 | −0.802 | 4.722 | −1.544 | 0.078 | 4.722 | −0.307 | −0.265 | 4.722 |
| 1.492 | −0.798 | 4.722 | −1.594 | 0.105 | 4.722 | −0.207 | −0.294 | 4.722 |
| 1.464 | −0.794 | 4.722 | −1.640 | 0.132 | 4.722 | −0.106 | −0.324 | 4.722 |
| 1.431 | −0.788 | 4.722 | −1.679 | 0.157 | 4.722 | −0.005 | −0.353 | 4.722 |
| 1.393 | −0.782 | 4.722 | −1.708 | 0.178 | 4.722 | 0.096 | −0.382 | 4.722 |
| 1.348 | −0.774 | 4.722 | −1.729 | 0.196 | 4.722 | 0.197 | −0.411 | 4.722 |
| 1.295 | −0.765 | 4.722 | −1.744 | 0.211 | 4.722 | 0.298 | −0.440 | 4.722 |
| 1.236 | −0.754 | 4.722 | −1.754 | 0.224 | 4.722 | 0.399 | −0.469 | 4.722 |
| 1.170 | −0.742 | 4.722 | −1.758 | 0.232 | 4.722 | 0.500 | −0.497 | 4.722 |
| 1.097 | −0.729 | 4.722 | −1.760 | 0.237 | 4.722 | 0.598 | −0.525 | 4.722 |
| 1.017 | −0.714 | 4.722 | −1.759 | 0.240 | 4.722 | 0.693 | −0.551 | 4.722 |
| 0.933 | −0.698 | 4.722 | −1.759 | 0.242 | 4.722 | 0.784 | −0.576 | 4.722 |
| 0.847 | −0.681 | 4.722 | −1.759 | 0.242 | 4.722 | 0.872 | −0.599 | 4.722 |
| 0.756 | −0.663 | 4.722 | −1.758 | 0.243 | 4.722 | 0.957 | −0.622 | 4.722 |
| 0.663 | −0.643 | 4.722 | −1.757 | 0.244 | 4.722 | 1.038 | −0.643 | 4.722 |
| 0.566 | −0.623 | 4.722 | −1.755 | 0.245 | 4.722 | 1.116 | −0.663 | 4.722 |
| 0.466 | −0.601 | 4.722 | −1.749 | 0.246 | 4.722 | 1.187 | −0.681 | 4.722 |
| 0.363 | −0.577 | 4.722 | −1.740 | 0.245 | 4.722 | 1.252 | −0.697 | 4.722 |
| 0.260 | −0.553 | 4.722 | −1.725 | 0.242 | 4.722 | 1.310 | −0.711 | 4.722 |
| 0.157 | −0.527 | 4.722 | −1.705 | 0.236 | 4.722 | 1.361 | −0.724 | 4.722 |
| 0.054 | −0.502 | 4.722 | −1.678 | 0.226 | 4.722 | 1.405 | −0.734 | 4.722 |
| −0.048 | −0.475 | 4.722 | −1.646 | 0.213 | 4.722 | 1.443 | −0.743 | 4.722 |
| −0.150 | −0.447 | 4.722 | −1.604 | 0.195 | 4.722 | 1.475 | −0.750 | 4.722 |
| −0.252 | −0.418 | 4.722 | −1.556 | 0.173 | 4.722 | 1.502 | −0.757 | 4.722 |

TABLE 10R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.353 | −0.388 | 4.722 | −1.504 | 0.151 | 4.722 | 1.524 | −0.762 | 4.722 |
| −0.454 | −0.357 | 4.722 | −1.446 | 0.127 | 4.722 | 1.542 | −0.766 | 4.722 |
| −0.555 | −0.325 | 4.722 | −1.381 | 0.100 | 4.722 | 1.555 | −0.769 | 4.722 |
| −0.655 | −0.291 | 4.722 | −1.310 | 0.072 | 4.722 | 1.565 | −0.773 | 4.722 |
| −0.755 | −0.257 | 4.722 | −1.235 | 0.043 | 4.722 | 1.570 | −0.780 | 4.722 |
| −0.851 | −0.222 | 4.722 | −1.156 | 0.014 | 4.722 | 1.571 | −0.787 | 4.722 |
| −0.944 | −0.187 | 4.722 | −1.074 | −0.016 | 4.722 | | | |
| −1.033 | −0.152 | 4.722 | −0.988 | −0.047 | 4.722 | | | |
| 1.549 | −0.787 | 5.042 | −1.151 | −0.111 | 5.042 | −0.933 | −0.077 | 5.042 |
| 1.548 | −0.792 | 5.042 | −1.232 | −0.075 | 5.042 | −0.839 | −0.108 | 5.042 |
| 1.543 | −0.797 | 5.042 | −1.311 | −0.041 | 5.042 | −0.743 | −0.141 | 5.042 |
| 1.536 | −0.802 | 5.042 | −1.385 | −0.006 | 5.042 | −0.642 | −0.173 | 5.042 |
| 1.525 | −0.802 | 5.042 | −1.456 | 0.028 | 5.042 | −0.542 | −0.204 | 5.042 |
| 1.511 | −0.800 | 5.042 | −1.520 | 0.060 | 5.042 | −0.441 | −0.235 | 5.042 |
| 1.493 | −0.797 | 5.042 | −1.577 | 0.090 | 5.042 | −0.339 | −0.265 | 5.042 |
| 1.470 | −0.793 | 5.042 | −1.627 | 0.117 | 5.042 | −0.238 | −0.295 | 5.042 |
| 1.442 | −0.789 | 5.042 | −1.673 | 0.144 | 5.042 | −0.137 | −0.324 | 5.042 |
| 1.409 | −0.783 | 5.042 | −1.712 | 0.169 | 5.042 | −0.035 | −0.353 | 5.042 |
| 1.370 | −0.777 | 5.042 | −1.741 | 0.190 | 5.042 | 0.066 | −0.382 | 5.042 |
| 1.325 | −0.770 | 5.042 | −1.763 | 0.208 | 5.042 | 0.168 | −0.411 | 5.042 |
| 1.272 | −0.761 | 5.042 | −1.778 | 0.223 | 5.042 | 0.269 | −0.439 | 5.042 |
| 1.213 | −0.751 | 5.042 | −1.789 | 0.236 | 5.042 | 0.371 | −0.468 | 5.042 |
| 1.146 | −0.739 | 5.042 | −1.793 | 0.243 | 5.042 | 0.473 | −0.496 | 5.042 |
| 1.073 | −0.726 | 5.042 | −1.794 | 0.249 | 5.042 | 0.571 | −0.523 | 5.042 |
| 0.992 | −0.711 | 5.042 | −1.794 | 0.252 | 5.042 | 0.666 | −0.548 | 5.042 |
| 0.908 | −0.696 | 5.042 | −1.794 | 0.253 | 5.042 | 0.758 | −0.573 | 5.042 |
| 0.821 | −0.679 | 5.042 | −1.793 | 0.254 | 5.042 | 0.846 | −0.597 | 5.042 |
| 0.730 | −0.661 | 5.042 | −1.793 | 0.254 | 5.042 | 0.931 | −0.619 | 5.042 |
| 0.636 | −0.642 | 5.042 | −1.792 | 0.255 | 5.042 | 1.013 | −0.640 | 5.042 |
| 0.539 | −0.622 | 5.042 | −1.789 | 0.256 | 5.042 | 1.091 | −0.660 | 5.042 |
| 0.439 | −0.600 | 5.042 | −1.783 | 0.257 | 5.042 | 1.163 | −0.677 | 5.042 |
| 0.335 | −0.577 | 5.042 | −1.775 | 0.256 | 5.042 | 1.228 | −0.693 | 5.042 |
| 0.231 | −0.552 | 5.042 | −1.759 | 0.253 | 5.042 | 1.286 | −0.707 | 5.042 |
| 0.128 | −0.527 | 5.042 | −1.739 | 0.246 | 5.042 | 1.338 | −0.719 | 5.042 |
| 0.025 | −0.501 | 5.042 | −1.713 | 0.236 | 5.042 | 1.382 | −0.729 | 5.042 |
| −0.078 | −0.474 | 5.042 | −1.681 | 0.222 | 5.042 | 1.420 | −0.738 | 5.042 |
| −0.180 | −0.446 | 5.042 | −1.639 | 0.203 | 5.042 | 1.452 | −0.746 | 5.042 |
| −0.282 | −0.417 | 5.042 | −1.591 | 0.181 | 5.042 | 1.479 | −0.752 | 5.042 |
| −0.384 | −0.386 | 5.042 | −1.539 | 0.158 | 5.042 | 1.501 | −0.757 | 5.042 |
| −0.485 | −0.355 | 5.042 | −1.481 | 0.133 | 5.042 | 1.519 | −0.760 | 5.042 |
| −0.586 | −0.322 | 5.042 | −1.416 | 0.106 | 5.042 | 1.533 | −0.763 | 5.042 |
| −0.687 | −0.288 | 5.042 | −1.345 | 0.077 | 5.042 | 1.543 | −0.768 | 5.042 |
| −0.787 | −0.252 | 5.042 | −1.270 | 0.047 | 5.042 | 1.548 | −0.775 | 5.042 |
| −0.883 | −0.217 | 5.042 | −1.191 | 0.017 | 5.042 | 1.550 | −0.781 | 5.042 |
| −0.976 | −0.181 | 5.042 | −1.108 | −0.014 | 5.042 | | | |
| −1.065 | −0.146 | 5.042 | −1.022 | −0.045 | 5.042 | | | |
| 1.424 | −0.870 | 5.931 | −1.274 | 0.049 | 5.931 | −1.058 | 0.029 | 5.931 |
| 1.422 | −0.876 | 5.931 | −1.350 | 0.100 | 5.931 | −0.969 | −0.018 | 5.931 |
| 1.417 | −0.882 | 5.931 | −1.422 | 0.152 | 5.931 | −0.877 | −0.065 | 5.931 |
| 1.409 | −0.886 | 5.931 | −1.489 | 0.202 | 5.931 | −0.780 | −0.112 | 5.931 |
| 1.398 | −0.885 | 5.931 | −1.553 | 0.252 | 5.931 | −0.682 | −0.158 | 5.931 |
| 1.384 | −0.883 | 5.931 | −1.610 | 0.298 | 5.931 | −0.584 | −0.202 | 5.931 |
| 1.365 | −0.880 | 5.931 | −1.661 | 0.340 | 5.931 | −0.485 | −0.245 | 5.931 |
| 1.341 | −0.877 | 5.931 | −1.705 | 0.379 | 5.931 | −0.385 | −0.286 | 5.931 |
| 1.313 | −0.872 | 5.931 | −1.746 | 0.416 | 5.931 | −0.285 | −0.326 | 5.931 |
| 1.279 | −0.867 | 5.931 | −1.780 | 0.449 | 5.931 | −0.183 | −0.364 | 5.931 |
| 1.239 | −0.860 | 5.931 | −1.805 | 0.476 | 5.931 | −0.082 | −0.401 | 5.931 |
| 1.192 | −0.852 | 5.931 | −1.823 | 0.499 | 5.931 | 0.020 | −0.436 | 5.931 |
| 1.138 | −0.843 | 5.931 | −1.836 | 0.517 | 5.931 | 0.123 | −0.471 | 5.931 |
| 1.077 | −0.832 | 5.931 | −1.844 | 0.531 | 5.931 | 0.225 | −0.505 | 5.931 |
| 1.009 | −0.819 | 5.931 | −1.847 | 0.540 | 5.931 | 0.328 | −0.539 | 5.931 |
| 0.933 | −0.805 | 5.931 | −1.848 | 0.546 | 5.931 | 0.427 | −0.571 | 5.931 |
| 0.851 | −0.788 | 5.931 | −1.847 | 0.549 | 5.931 | 0.524 | −0.601 | 5.931 |
| 0.765 | −0.770 | 5.931 | −1.846 | 0.550 | 5.931 | 0.617 | −0.630 | 5.931 |
| 0.676 | −0.751 | 5.931 | −1.846 | 0.551 | 5.931 | 0.706 | −0.657 | 5.931 |
| 0.583 | −0.729 | 5.931 | −1.845 | 0.551 | 5.931 | 0.792 | −0.684 | 5.931 |
| 0.487 | −0.706 | 5.931 | −1.844 | 0.552 | 5.931 | 0.875 | −0.708 | 5.931 |
| 0.389 | −0.681 | 5.931 | −1.841 | 0.552 | 5.931 | 0.955 | −0.731 | 5.931 |
| 0.287 | −0.653 | 5.931 | −1.835 | 0.551 | 5.931 | 1.028 | −0.752 | 5.931 |
| 0.182 | −0.623 | 5.931 | −1.827 | 0.547 | 5.931 | 1.094 | −0.770 | 5.931 |
| 0.077 | −0.592 | 5.931 | −1.813 | 0.540 | 5.931 | 1.153 | −0.785 | 5.931 |
| −0.027 | −0.558 | 5.931 | −1.795 | 0.528 | 5.931 | 1.205 | −0.799 | 5.931 |
| −0.130 | −0.522 | 5.931 | −1.771 | 0.511 | 5.931 | 1.251 | −0.810 | 5.931 |
| −0.232 | −0.484 | 5.931 | −1.743 | 0.488 | 5.931 | 1.289 | −0.820 | 5.931 |
| −0.334 | −0.444 | 5.931 | −1.706 | 0.459 | 5.931 | 1.322 | −0.828 | 5.931 |
| −0.435 | −0.401 | 5.931 | −1.663 | 0.426 | 5.931 | 1.350 | −0.834 | 5.931 |
| −0.536 | −0.357 | 5.931 | −1.617 | 0.391 | 5.931 | 1.373 | −0.840 | 5.931 |

TABLE 10R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.636 | −0.311 | 5.931 | −1.565 | 0.352 | 5.931 | 1.391 | −0.845 | 5.931 |
| −0.735 | −0.262 | 5.931 | −1.506 | 0.310 | 5.931 | 1.405 | −0.848 | 5.931 |
| −0.832 | −0.212 | 5.931 | −1.441 | 0.265 | 5.931 | 1.415 | −0.852 | 5.931 |
| −0.929 | −0.160 | 5.931 | −1.372 | 0.218 | 5.931 | 1.421 | −0.858 | 5.931 |
| −1.022 | −0.108 | 5.931 | −1.299 | 0.171 | 5.931 | 1.424 | −0.865 | 5.931 |
| −1.111 | −0.056 | 5.931 | −1.223 | 0.124 | 5.931 | | | |
| −1.195 | −0.003 | 5.931 | −1.142 | 0.077 | 5.931 | | | |

The coordinate values given in TABLE 11R below provide the nominal profile envelope for an exemplary eleventh stage rotor.

TABLE 11R

| X-LOC | Y-LOC | Z-LOC | X-LOC | Y-LOC | Z-LOC | X-LOC | Y-LOC | Z-LOC |
|---|---|---|---|---|---|---|---|---|
| 1.983 | −0.094 | 0.000 | −0.893 | −0.129 | 0.000 | −0.622 | 0.087 | 0.000 |
| 1.983 | −0.099 | 0.000 | −0.979 | −0.092 | 0.000 | −0.524 | 0.070 | 0.000 |
| 1.982 | −0.107 | 0.000 | −1.060 | −0.053 | 0.000 | −0.421 | 0.055 | 0.000 |
| 1.979 | −0.115 | 0.000 | −1.137 | −0.013 | 0.000 | −0.315 | 0.041 | 0.000 |
| 1.972 | −0.125 | 0.000 | −1.208 | 0.028 | 0.000 | −0.208 | 0.029 | 0.000 |
| 1.960 | −0.133 | 0.000 | −1.272 | 0.068 | 0.000 | −0.102 | 0.019 | 0.000 |
| 1.942 | −0.138 | 0.000 | −1.328 | 0.106 | 0.000 | 0.005 | 0.011 | 0.000 |
| 1.918 | −0.142 | 0.000 | −1.377 | 0.141 | 0.000 | 0.112 | 0.003 | 0.000 |
| 1.889 | −0.147 | 0.000 | −1.422 | 0.176 | 0.000 | 0.219 | −0.004 | 0.000 |
| 1.854 | −0.152 | 0.000 | −1.460 | 0.206 | 0.000 | 0.325 | −0.010 | 0.000 |
| 1.814 | −0.159 | 0.000 | −1.487 | 0.232 | 0.000 | 0.432 | −0.016 | 0.000 |
| 1.766 | −0.166 | 0.000 | −1.508 | 0.254 | 0.000 | 0.539 | −0.021 | 0.000 |
| 1.711 | −0.175 | 0.000 | −1.521 | 0.272 | 0.000 | 0.646 | −0.026 | 0.000 |
| 1.649 | −0.184 | 0.000 | −1.528 | 0.288 | 0.000 | 0.753 | −0.031 | 0.000 |
| 1.579 | −0.194 | 0.000 | −1.529 | 0.297 | 0.000 | 0.860 | −0.036 | 0.000 |
| 1.501 | −0.205 | 0.000 | −1.529 | 0.303 | 0.000 | 0.964 | −0.040 | 0.000 |
| 1.417 | −0.217 | 0.000 | −1.528 | 0.306 | 0.000 | 1.064 | −0.044 | 0.000 |
| 1.328 | −0.230 | 0.000 | −1.527 | 0.307 | 0.000 | 1.160 | −0.048 | 0.000 |
| 1.236 | −0.242 | 0.000 | −1.527 | 0.308 | 0.000 | 1.253 | −0.051 | 0.000 |
| 1.140 | −0.254 | 0.000 | −1.526 | 0.308 | 0.000 | 1.342 | −0.053 | 0.000 |
| 1.041 | −0.267 | 0.000 | −1.526 | 0.309 | 0.000 | 1.428 | −0.055 | 0.000 |
| 0.937 | −0.278 | 0.000 | −1.524 | 0.312 | 0.000 | 1.510 | −0.056 | 0.000 |
| 0.830 | −0.290 | 0.000 | −1.519 | 0.315 | 0.000 | 1.585 | −0.057 | 0.000 |
| 0.719 | −0.300 | 0.000 | −1.510 | 0.318 | 0.000 | 1.653 | −0.058 | 0.000 |
| 0.608 | −0.310 | 0.000 | −1.494 | 0.319 | 0.000 | 1.713 | −0.058 | 0.000 |
| 0.497 | −0.318 | 0.000 | −1.473 | 0.317 | 0.000 | 1.767 | −0.058 | 0.000 |
| 0.386 | −0.324 | 0.000 | −1.445 | 0.311 | 0.000 | 1.813 | −0.058 | 0.000 |
| 0.275 | −0.328 | 0.000 | −1.411 | 0.301 | 0.000 | 1.853 | −0.058 | 0.000 |
| 0.164 | −0.329 | 0.000 | −1.367 | 0.286 | 0.000 | 1.886 | −0.058 | 0.000 |
| 0.053 | −0.327 | 0.000 | −1.316 | 0.269 | 0.000 | 1.914 | −0.057 | 0.000 |
| −0.058 | −0.321 | 0.000 | −1.261 | 0.251 | 0.000 | 1.938 | −0.057 | 0.000 |
| −0.169 | −0.312 | 0.000 | −1.200 | 0.231 | 0.000 | 1.956 | −0.059 | 0.000 |
| −0.280 | −0.298 | 0.000 | −1.132 | 0.209 | 0.000 | 1.968 | −0.066 | 0.000 |
| −0.391 | −0.280 | 0.000 | −1.057 | 0.187 | 0.000 | 1.975 | −0.074 | 0.000 |
| −0.501 | −0.256 | 0.000 | −0.978 | 0.165 | 0.000 | 1.980 | −0.082 | 0.000 |
| −0.606 | −0.229 | 0.000 | −0.895 | 0.144 | 0.000 | 1.982 | −0.089 | 0.000 |
| −0.706 | −0.198 | 0.000 | −0.808 | 0.124 | 0.000 | | | |
| −0.802 | −0.165 | 0.000 | −0.717 | 0.105 | 0.000 | | | |
| 1.956 | −0.147 | 0.726 | −0.885 | −0.100 | 0.726 | −0.628 | 0.138 | 0.726 |
| 1.956 | −0.153 | 0.726 | −0.972 | −0.067 | 0.726 | −0.529 | 0.124 | 0.726 |
| 1.954 | −0.160 | 0.726 | −1.054 | −0.033 | 0.726 | −0.427 | 0.110 | 0.726 |
| 1.951 | −0.168 | 0.726 | −1.132 | 0.002 | 0.726 | −0.321 | 0.097 | 0.726 |
| 1.944 | −0.177 | 0.726 | −1.205 | 0.039 | 0.726 | −0.215 | 0.084 | 0.726 |
| 1.932 | −0.184 | 0.726 | −1.271 | 0.074 | 0.726 | −0.110 | 0.072 | 0.726 |
| 1.913 | −0.188 | 0.726 | −1.329 | 0.107 | 0.726 | −0.004 | 0.061 | 0.726 |
| 1.889 | −0.190 | 0.726 | −1.379 | 0.139 | 0.726 | 0.102 | 0.049 | 0.726 |
| 1.861 | −0.193 | 0.726 | −1.426 | 0.169 | 0.726 | 0.208 | 0.038 | 0.726 |
| 1.826 | −0.196 | 0.726 | −1.465 | 0.197 | 0.726 | 0.314 | 0.028 | 0.726 |
| 1.786 | −0.200 | 0.726 | −1.495 | 0.220 | 0.726 | 0.420 | 0.017 | 0.726 |
| 1.739 | −0.204 | 0.726 | −1.517 | 0.240 | 0.726 | 0.526 | 0.007 | 0.726 |
| 1.684 | −0.209 | 0.726 | −1.531 | 0.257 | 0.726 | 0.633 | −0.004 | 0.726 |
| 1.622 | −0.215 | 0.726 | −1.540 | 0.271 | 0.726 | 0.739 | −0.014 | 0.726 |
| 1.553 | −0.221 | 0.726 | −1.543 | 0.280 | 0.726 | 0.845 | −0.025 | 0.726 |
| 1.476 | −0.227 | 0.726 | −1.543 | 0.286 | 0.726 | 0.947 | −0.034 | 0.726 |
| 1.392 | −0.234 | 0.726 | −1.542 | 0.289 | 0.726 | 1.046 | −0.044 | 0.726 |
| 1.305 | −0.240 | 0.726 | −1.542 | 0.290 | 0.726 | 1.142 | −0.052 | 0.726 |
| 1.214 | −0.248 | 0.726 | −1.541 | 0.291 | 0.726 | 1.234 | −0.060 | 0.726 |

TABLE 11R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.119 | −0.255 | 0.726 | −1.541 | 0.291 | 0.726 | 1.322 | −0.068 | 0.726 |
| 1.020 | −0.261 | 0.726 | −1.540 | 0.293 | 0.726 | 1.407 | −0.075 | 0.726 |
| 0.918 | −0.268 | 0.726 | −1.538 | 0.295 | 0.726 | 1.489 | −0.081 | 0.726 |
| 0.812 | −0.274 | 0.726 | −1.534 | 0.299 | 0.726 | 1.563 | −0.086 | 0.726 |
| 0.702 | −0.279 | 0.726 | −1.526 | 0.302 | 0.726 | 1.630 | −0.091 | 0.726 |
| 0.593 | −0.283 | 0.726 | −1.510 | 0.305 | 0.726 | 1.691 | −0.095 | 0.726 |
| 0.483 | −0.286 | 0.726 | −1.489 | 0.305 | 0.726 | 1.744 | −0.098 | 0.726 |
| 0.374 | −0.287 | 0.726 | −1.460 | 0.301 | 0.726 | 1.790 | −0.101 | 0.726 |
| 0.265 | −0.287 | 0.726 | −1.425 | 0.295 | 0.726 | 1.829 | −0.104 | 0.726 |
| 0.156 | −0.284 | 0.726 | −1.380 | 0.285 | 0.726 | 1.862 | −0.106 | 0.726 |
| 0.047 | −0.280 | 0.726 | −1.328 | 0.274 | 0.726 | 1.890 | −0.107 | 0.726 |
| −0.062 | −0.272 | 0.726 | −1.273 | 0.261 | 0.726 | 1.913 | −0.109 | 0.726 |
| −0.170 | −0.262 | 0.726 | −1.210 | 0.247 | 0.726 | 1.931 | −0.112 | 0.726 |
| −0.278 | −0.249 | 0.726 | −1.141 | 0.232 | 0.726 | 1.943 | −0.119 | 0.726 |
| −0.386 | −0.232 | 0.726 | −1.065 | 0.216 | 0.726 | 1.950 | −0.127 | 0.726 |
| −0.494 | −0.212 | 0.726 | −0.984 | 0.200 | 0.726 | 1.954 | −0.135 | 0.726 |
| −0.598 | −0.188 | 0.726 | −0.901 | 0.184 | 0.726 | 1.956 | −0.142 | 0.726 |
| −0.697 | −0.161 | 0.726 | −0.813 | 0.168 | 0.726 | | | |
| −0.793 | −0.131 | 0.726 | −0.722 | 0.153 | 0.726 | | | |
| 1.938 | −0.272 | 1.452 | −0.881 | −0.042 | 1.452 | −0.620 | 0.187 | 1.452 |
| 1.937 | −0.277 | 1.452 | −0.966 | −0.008 | 1.452 | −0.522 | 0.170 | 1.452 |
| 1.935 | −0.284 | 1.452 | −1.047 | 0.027 | 1.452 | −0.420 | 0.152 | 1.452 |
| 1.930 | −0.292 | 1.452 | −1.124 | 0.062 | 1.452 | −0.315 | 0.135 | 1.452 |
| 1.922 | −0.299 | 1.452 | −1.196 | 0.098 | 1.452 | −0.210 | 0.117 | 1.452 |
| 1.909 | −0.304 | 1.452 | −1.261 | 0.133 | 1.452 | −0.106 | 0.099 | 1.452 |
| 1.890 | −0.305 | 1.452 | −1.319 | 0.165 | 1.452 | −0.001 | 0.081 | 1.452 |
| 1.867 | −0.306 | 1.452 | −1.369 | 0.196 | 1.452 | 0.104 | 0.063 | 1.452 |
| 1.838 | −0.306 | 1.452 | −1.415 | 0.226 | 1.452 | 0.209 | 0.046 | 1.452 |
| 1.804 | −0.307 | 1.452 | −1.454 | 0.253 | 1.452 | 0.314 | 0.028 | 1.452 |
| 1.764 | −0.307 | 1.452 | −1.484 | 0.275 | 1.452 | 0.419 | 0.010 | 1.452 |
| 1.717 | −0.308 | 1.452 | −1.506 | 0.294 | 1.452 | 0.524 | −0.008 | 1.452 |
| 1.662 | −0.308 | 1.452 | −1.521 | 0.310 | 1.452 | 0.629 | −0.027 | 1.452 |
| 1.601 | −0.309 | 1.452 | −1.530 | 0.324 | 1.452 | 0.734 | −0.045 | 1.452 |
| 1.532 | −0.309 | 1.452 | −1.533 | 0.333 | 1.452 | 0.839 | −0.063 | 1.452 |
| 1.455 | −0.310 | 1.452 | −1.533 | 0.339 | 1.452 | 0.940 | −0.081 | 1.452 |
| 1.372 | −0.310 | 1.452 | −1.533 | 0.341 | 1.452 | 1.038 | −0.098 | 1.452 |
| 1.285 | −0.310 | 1.452 | −1.532 | 0.343 | 1.452 | 1.132 | −0.114 | 1.452 |
| 1.194 | −0.310 | 1.452 | −1.532 | 0.344 | 1.452 | 1.223 | −0.129 | 1.452 |
| 1.099 | −0.309 | 1.452 | −1.532 | 0.344 | 1.452 | 1.311 | −0.144 | 1.452 |
| 1.001 | −0.309 | 1.452 | −1.531 | 0.345 | 1.452 | 1.395 | −0.157 | 1.452 |
| 0.900 | −0.308 | 1.452 | −1.529 | 0.348 | 1.452 | 1.476 | −0.170 | 1.452 |
| 0.794 | −0.306 | 1.452 | −1.525 | 0.351 | 1.452 | 1.549 | −0.181 | 1.452 |
| 0.686 | −0.303 | 1.452 | −1.516 | 0.355 | 1.452 | 1.616 | −0.191 | 1.452 |
| 0.577 | −0.299 | 1.452 | −1.500 | 0.357 | 1.452 | 1.676 | −0.200 | 1.452 |
| 0.469 | −0.294 | 1.452 | −1.479 | 0.357 | 1.452 | 1.728 | −0.208 | 1.452 |
| 0.360 | −0.288 | 1.452 | −1.451 | 0.354 | 1.452 | 1.774 | −0.215 | 1.452 |
| 0.252 | −0.280 | 1.452 | −1.416 | 0.347 | 1.452 | 1.813 | −0.221 | 1.452 |
| 0.144 | −0.270 | 1.452 | −1.371 | 0.339 | 1.452 | 1.846 | −0.225 | 1.452 |
| 0.037 | −0.258 | 1.452 | −1.319 | 0.328 | 1.452 | 1.873 | −0.229 | 1.452 |
| −0.071 | −0.244 | 1.452 | −1.263 | 0.316 | 1.452 | 1.896 | −0.233 | 1.452 |
| −0.178 | −0.228 | 1.452 | −1.201 | 0.303 | 1.452 | 1.914 | −0.236 | 1.452 |
| −0.285 | −0.210 | 1.452 | −1.131 | 0.288 | 1.452 | 1.926 | −0.243 | 1.452 |
| −0.391 | −0.188 | 1.452 | −1.055 | 0.271 | 1.452 | 1.933 | −0.251 | 1.452 |
| −0.497 | −0.163 | 1.452 | −0.975 | 0.255 | 1.452 | 1.936 | −0.259 | 1.452 |
| −0.599 | −0.135 | 1.452 | −0.892 | 0.238 | 1.452 | 1.938 | −0.266 | 1.452 |
| −0.697 | −0.106 | 1.452 | −0.805 | 0.221 | 1.452 | | | |
| −0.791 | −0.074 | 1.452 | −0.714 | 0.204 | 1.452 | | | |
| 1.934 | −0.416 | 2.178 | −0.855 | 0.001 | 2.178 | −0.589 | 0.208 | 2.178 |
| 1.933 | −0.421 | 2.178 | −0.937 | 0.038 | 2.178 | −0.492 | 0.186 | 2.178 |
| 1.930 | −0.428 | 2.178 | −1.016 | 0.075 | 2.178 | −0.392 | 0.164 | 2.178 |
| 1.924 | −0.434 | 2.178 | −1.091 | 0.112 | 2.178 | −0.288 | 0.141 | 2.178 |
| 1.915 | −0.439 | 2.178 | −1.161 | 0.149 | 2.178 | −0.184 | 0.117 | 2.178 |
| 1.900 | −0.441 | 2.178 | −1.225 | 0.185 | 2.178 | −0.081 | 0.093 | 2.178 |
| 1.882 | −0.440 | 2.178 | −1.282 | 0.218 | 2.178 | 0.023 | 0.069 | 2.178 |
| 1.858 | −0.439 | 2.178 | −1.331 | 0.250 | 2.178 | 0.126 | 0.045 | 2.178 |
| 1.830 | −0.437 | 2.178 | −1.377 | 0.280 | 2.178 | 0.230 | 0.021 | 2.178 |
| 1.796 | −0.435 | 2.178 | −1.415 | 0.307 | 2.178 | 0.333 | −0.004 | 2.178 |
| 1.756 | −0.433 | 2.178 | −1.445 | 0.329 | 2.178 | 0.437 | −0.029 | 2.178 |
| 1.709 | −0.430 | 2.178 | −1.468 | 0.347 | 2.178 | 0.540 | −0.055 | 2.178 |
| 1.654 | −0.427 | 2.178 | −1.483 | 0.363 | 2.178 | 0.643 | −0.080 | 2.178 |
| 1.593 | −0.424 | 2.178 | −1.492 | 0.376 | 2.178 | 0.746 | −0.106 | 2.178 |
| 1.524 | −0.419 | 2.178 | −1.496 | 0.385 | 2.178 | 0.850 | −0.132 | 2.178 |
| 1.448 | −0.415 | 2.178 | −1.497 | 0.390 | 2.178 | 0.949 | −0.157 | 2.178 |
| 1.365 | −0.409 | 2.178 | −1.496 | 0.393 | 2.178 | 1.046 | −0.181 | 2.178 |
| 1.278 | −0.403 | 2.178 | −1.496 | 0.395 | 2.178 | 1.138 | −0.204 | 2.178 |
| 1.188 | −0.397 | 2.178 | −1.495 | 0.395 | 2.178 | 1.228 | −0.226 | 2.178 |
| 1.094 | −0.391 | 2.178 | −1.495 | 0.396 | 2.178 | 1.314 | −0.247 | 2.178 |

TABLE 11R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.996 | −0.383 | 2.178 | −1.494 | 0.397 | 2.178 | 1.397 | −0.267 | 2.178 |
| 0.895 | −0.375 | 2.178 | −1.492 | 0.399 | 2.178 | 1.476 | −0.285 | 2.178 |
| 0.791 | −0.366 | 2.178 | −1.488 | 0.403 | 2.178 | 1.549 | −0.302 | 2.178 |
| 0.682 | −0.356 | 2.178 | −1.479 | 0.406 | 2.178 | 1.615 | −0.317 | 2.178 |
| 0.574 | −0.344 | 2.178 | −1.463 | 0.407 | 2.178 | 1.673 | −0.330 | 2.178 |
| 0.466 | −0.331 | 2.178 | −1.442 | 0.406 | 2.178 | 1.725 | −0.342 | 2.178 |
| 0.359 | −0.317 | 2.178 | −1.414 | 0.401 | 2.178 | 1.770 | −0.352 | 2.178 |
| 0.251 | −0.301 | 2.178 | −1.379 | 0.394 | 2.178 | 1.808 | −0.361 | 2.178 |
| 0.144 | −0.284 | 2.178 | −1.334 | 0.384 | 2.178 | 1.841 | −0.368 | 2.178 |
| 0.037 | −0.264 | 2.178 | −1.283 | 0.372 | 2.178 | 1.868 | −0.374 | 2.178 |
| −0.069 | −0.243 | 2.178 | −1.227 | 0.359 | 2.178 | 1.891 | −0.379 | 2.178 |
| −0.174 | −0.220 | 2.178 | −1.165 | 0.344 | 2.178 | 1.909 | −0.383 | 2.178 |
| −0.279 | −0.194 | 2.178 | −1.096 | 0.327 | 2.178 | 1.922 | −0.388 | 2.178 |
| −0.382 | −0.166 | 2.178 | −1.021 | 0.309 | 2.178 | 1.929 | −0.395 | 2.178 |
| −0.485 | −0.135 | 2.178 | −0.941 | 0.289 | 2.178 | 1.933 | −0.403 | 2.178 |
| −0.584 | −0.103 | 2.178 | −0.859 | 0.270 | 2.178 | 1.935 | −0.410 | 2.178 |
| −0.678 | −0.069 | 2.178 | −0.772 | 0.250 | 2.178 | | | |
| −0.769 | −0.034 | 2.178 | −0.683 | 0.229 | 2.178 | | | |
| 1.934 | −0.480 | 2.541 | −0.833 | 0.009 | 2.541 | −0.572 | 0.209 | 2.541 |
| 1.933 | −0.485 | 2.541 | −0.916 | 0.047 | 2.541 | −0.476 | 0.185 | 2.541 |
| 1.929 | −0.492 | 2.541 | −0.995 | 0.086 | 2.541 | −0.376 | 0.160 | 2.541 |
| 1.923 | −0.498 | 2.541 | −1.069 | 0.125 | 2.541 | −0.273 | 0.135 | 2.541 |
| 1.913 | −0.502 | 2.541 | −1.140 | 0.163 | 2.541 | −0.170 | 0.109 | 2.541 |
| 1.898 | −0.501 | 2.541 | −1.204 | 0.199 | 2.541 | −0.067 | 0.083 | 2.541 |
| 1.880 | −0.500 | 2.541 | −1.260 | 0.233 | 2.541 | 0.036 | 0.056 | 2.541 |
| 1.856 | −0.498 | 2.541 | −1.310 | 0.265 | 2.541 | 0.139 | 0.030 | 2.541 |
| 1.828 | −0.496 | 2.541 | −1.355 | 0.296 | 2.541 | 0.242 | 0.002 | 2.541 |
| 1.794 | −0.493 | 2.541 | −1.394 | 0.323 | 2.541 | 0.344 | −0.025 | 2.541 |
| 1.755 | −0.490 | 2.541 | −1.424 | 0.345 | 2.541 | 0.447 | −0.053 | 2.541 |
| 1.708 | −0.486 | 2.541 | −1.447 | 0.363 | 2.541 | 0.549 | −0.081 | 2.541 |
| 1.654 | −0.482 | 2.541 | −1.462 | 0.378 | 2.541 | 0.652 | −0.110 | 2.541 |
| 1.593 | −0.477 | 2.541 | −1.472 | 0.392 | 2.541 | 0.754 | −0.138 | 2.541 |
| 1.524 | −0.471 | 2.541 | −1.476 | 0.400 | 2.541 | 0.857 | −0.167 | 2.541 |
| 1.449 | −0.464 | 2.541 | −1.476 | 0.406 | 2.541 | 0.956 | −0.195 | 2.541 |
| 1.366 | −0.457 | 2.541 | −1.476 | 0.409 | 2.541 | 1.051 | −0.222 | 2.541 |
| 1.280 | −0.449 | 2.541 | −1.475 | 0.410 | 2.541 | 1.143 | −0.247 | 2.541 |
| 1.190 | −0.441 | 2.541 | −1.475 | 0.411 | 2.541 | 1.232 | −0.272 | 2.541 |
| 1.097 | −0.432 | 2.541 | −1.475 | 0.412 | 2.541 | 1.318 | −0.295 | 2.541 |
| 1.000 | −0.422 | 2.541 | −1.474 | 0.413 | 2.541 | 1.400 | −0.318 | 2.541 |
| 0.900 | −0.411 | 2.541 | −1.472 | 0.415 | 2.541 | 1.479 | −0.338 | 2.541 |
| 0.796 | −0.400 | 2.541 | −1.467 | 0.418 | 2.541 | 1.551 | −0.357 | 2.541 |
| 0.689 | −0.386 | 2.541 | −1.459 | 0.421 | 2.541 | 1.616 | −0.374 | 2.541 |
| 0.582 | −0.372 | 2.541 | −1.443 | 0.422 | 2.541 | 1.674 | −0.389 | 2.541 |
| 0.476 | −0.357 | 2.541 | −1.422 | 0.420 | 2.541 | 1.726 | −0.403 | 2.541 |
| 0.370 | −0.340 | 2.541 | −1.394 | 0.415 | 2.541 | 1.770 | −0.414 | 2.541 |
| 0.264 | −0.321 | 2.541 | −1.359 | 0.406 | 2.541 | 1.808 | −0.424 | 2.541 |
| 0.159 | −0.301 | 2.541 | −1.315 | 0.396 | 2.541 | 1.840 | −0.432 | 2.541 |
| 0.054 | −0.279 | 2.541 | −1.263 | 0.384 | 2.541 | 1.867 | −0.439 | 2.541 |
| −0.051 | −0.255 | 2.541 | −1.208 | 0.370 | 2.541 | 1.890 | −0.444 | 2.541 |
| −0.155 | −0.229 | 2.541 | −1.146 | 0.354 | 2.541 | 1.908 | −0.449 | 2.541 |
| −0.258 | −0.200 | 2.541 | −1.077 | 0.336 | 2.541 | 1.921 | −0.453 | 2.541 |
| −0.361 | −0.169 | 2.541 | −1.002 | 0.317 | 2.541 | 1.929 | −0.460 | 2.541 |
| −0.463 | −0.136 | 2.541 | −0.923 | 0.296 | 2.541 | 1.933 | −0.468 | 2.541 |
| −0.561 | −0.101 | 2.541 | −0.841 | 0.275 | 2.541 | 1.934 | −0.475 | 2.541 |
| −0.656 | −0.065 | 2.541 | −0.755 | 0.254 | 2.541 | | | |
| −0.746 | −0.028 | 2.541 | −0.665 | 0.231 | 2.541 | | | |
| 1.933 | −0.533 | 2.905 | −0.823 | 0.020 | 2.905 | −0.558 | 0.208 | 2.905 |
| 1.931 | −0.538 | 2.905 | −0.905 | 0.059 | 2.905 | −0.463 | 0.183 | 2.905 |
| 1.928 | −0.544 | 2.905 | −0.983 | 0.099 | 2.905 | −0.363 | 0.156 | 2.905 |
| 1.921 | −0.549 | 2.905 | −1.056 | 0.138 | 2.905 | −0.261 | 0.129 | 2.905 |
| 1.910 | −0.552 | 2.905 | −1.126 | 0.177 | 2.905 | −0.158 | 0.101 | 2.905 |
| 1.896 | −0.551 | 2.905 | −1.189 | 0.214 | 2.905 | −0.055 | 0.073 | 2.905 |
| 1.877 | −0.549 | 2.905 | −1.245 | 0.248 | 2.905 | 0.047 | 0.045 | 2.905 |
| 1.854 | −0.547 | 2.905 | −1.293 | 0.280 | 2.905 | 0.149 | 0.016 | 2.905 |
| 1.825 | −0.544 | 2.905 | −1.338 | 0.311 | 2.905 | 0.251 | −0.013 | 2.905 |
| 1.792 | −0.541 | 2.905 | −1.377 | 0.338 | 2.905 | 0.353 | −0.043 | 2.905 |
| 1.752 | −0.537 | 2.905 | −1.406 | 0.360 | 2.905 | 0.455 | −0.073 | 2.905 |
| 1.706 | −0.533 | 2.905 | −1.429 | 0.378 | 2.905 | 0.557 | −0.104 | 2.905 |
| 1.652 | −0.527 | 2.905 | −1.445 | 0.393 | 2.905 | 0.659 | −0.134 | 2.905 |
| 1.591 | −0.521 | 2.905 | −1.454 | 0.406 | 2.905 | 0.760 | −0.165 | 2.905 |
| 1.523 | −0.514 | 2.905 | −1.458 | 0.415 | 2.905 | 0.862 | −0.196 | 2.905 |
| 1.448 | −0.506 | 2.905 | −1.459 | 0.420 | 2.905 | 0.960 | −0.226 | 2.905 |
| 1.366 | −0.497 | 2.905 | −1.458 | 0.423 | 2.905 | 1.055 | −0.255 | 2.905 |
| 1.280 | −0.488 | 2.905 | −1.458 | 0.425 | 2.905 | 1.147 | −0.283 | 2.905 |
| 1.190 | −0.478 | 2.905 | −1.457 | 0.425 | 2.905 | 1.235 | −0.310 | 2.905 |
| 1.097 | −0.467 | 2.905 | −1.457 | 0.426 | 2.905 | 1.319 | −0.336 | 2.905 |
| 1.001 | −0.456 | 2.905 | −1.456 | 0.427 | 2.905 | 1.401 | −0.360 | 2.905 |

TABLE 11R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.901 | −0.443 | 2.905 | −1.454 | 0.429 | 2.905 | 1.479 | −0.383 | 2.905 |
| 0.798 | −0.429 | 2.905 | −1.450 | 0.432 | 2.905 | 1.551 | −0.403 | 2.905 |
| 0.692 | −0.414 | 2.905 | −1.441 | 0.435 | 2.905 | 1.615 | −0.422 | 2.905 |
| 0.585 | −0.397 | 2.905 | −1.425 | 0.435 | 2.905 | 1.673 | −0.438 | 2.905 |
| 0.479 | −0.379 | 2.905 | −1.404 | 0.433 | 2.905 | 1.724 | −0.453 | 2.905 |
| 0.374 | −0.360 | 2.905 | −1.376 | 0.427 | 2.905 | 1.769 | −0.465 | 2.905 |
| 0.268 | −0.339 | 2.905 | −1.342 | 0.418 | 2.905 | 1.806 | −0.476 | 2.905 |
| 0.164 | −0.316 | 2.905 | −1.297 | 0.407 | 2.905 | 1.838 | −0.484 | 2.905 |
| 0.059 | −0.291 | 2.905 | −1.246 | 0.394 | 2.905 | 1.865 | −0.492 | 2.905 |
| −0.045 | −0.264 | 2.905 | −1.191 | 0.380 | 2.905 | 1.887 | −0.498 | 2.905 |
| −0.148 | −0.235 | 2.905 | −1.129 | 0.363 | 2.905 | 1.905 | −0.503 | 2.905 |
| −0.251 | −0.204 | 2.905 | −1.061 | 0.344 | 2.905 | 1.919 | −0.507 | 2.905 |
| −0.353 | −0.170 | 2.905 | −0.986 | 0.323 | 2.905 | 1.927 | −0.513 | 2.905 |
| −0.455 | −0.134 | 2.905 | −0.907 | 0.302 | 2.905 | 1.932 | −0.521 | 2.905 |
| −0.553 | −0.096 | 2.905 | −0.825 | 0.279 | 2.905 | 1.933 | −0.527 | 2.905 |
| −0.647 | −0.058 | 2.905 | −0.740 | 0.256 | 2.905 | | | |
| −0.737 | −0.019 | 2.905 | −0.651 | 0.233 | 2.905 | | | |
| 1.932 | −0.593 | 3.631 | −0.807 | 0.025 | 3.631 | −0.543 | 0.200 | 3.631 |
| 1.930 | −0.598 | 3.631 | −0.888 | 0.065 | 3.631 | −0.448 | 0.173 | 3.631 |
| 1.926 | −0.603 | 3.631 | −0.965 | 0.104 | 3.631 | −0.349 | 0.145 | 3.631 |
| 1.918 | −0.608 | 3.631 | −1.039 | 0.144 | 3.631 | −0.247 | 0.116 | 3.631 |
| 1.907 | −0.608 | 3.631 | −1.108 | 0.182 | 3.631 | −0.145 | 0.086 | 3.631 |
| 1.893 | −0.607 | 3.631 | −1.170 | 0.218 | 3.631 | −0.043 | 0.057 | 3.631 |
| 1.875 | −0.605 | 3.631 | −1.226 | 0.252 | 3.631 | 0.059 | 0.027 | 3.631 |
| 1.851 | −0.602 | 3.631 | −1.275 | 0.283 | 3.631 | 0.161 | −0.004 | 3.631 |
| 1.823 | −0.599 | 3.631 | −1.320 | 0.313 | 3.631 | 0.262 | −0.035 | 3.631 |
| 1.790 | −0.595 | 3.631 | −1.358 | 0.340 | 3.631 | 0.364 | −0.066 | 3.631 |
| 1.750 | −0.591 | 3.631 | −1.388 | 0.361 | 3.631 | 0.465 | −0.098 | 3.631 |
| 1.704 | −0.586 | 3.631 | −1.410 | 0.379 | 3.631 | 0.566 | −0.131 | 3.631 |
| 1.651 | −0.579 | 3.631 | −1.426 | 0.393 | 3.631 | 0.667 | −0.164 | 3.631 |
| 1.590 | −0.572 | 3.631 | −1.436 | 0.406 | 3.631 | 0.768 | −0.197 | 3.631 |
| 1.522 | −0.564 | 3.631 | −1.440 | 0.414 | 3.631 | 0.869 | −0.231 | 3.631 |
| 1.447 | −0.555 | 3.631 | −1.441 | 0.420 | 3.631 | 0.966 | −0.264 | 3.631 |
| 1.366 | −0.545 | 3.631 | −1.440 | 0.423 | 3.631 | 1.060 | −0.295 | 3.631 |
| 1.280 | −0.534 | 3.631 | −1.440 | 0.424 | 3.631 | 1.150 | −0.326 | 3.631 |
| 1.191 | −0.522 | 3.631 | −1.440 | 0.425 | 3.631 | 1.238 | −0.355 | 3.631 |
| 1.099 | −0.510 | 3.631 | −1.439 | 0.426 | 3.631 | 1.322 | −0.383 | 3.631 |
| 1.003 | −0.497 | 3.631 | −1.439 | 0.427 | 3.631 | 1.402 | −0.409 | 3.631 |
| 0.904 | −0.482 | 3.631 | −1.437 | 0.429 | 3.631 | 1.480 | −0.434 | 3.631 |
| 0.801 | −0.466 | 3.631 | −1.432 | 0.432 | 3.631 | 1.551 | −0.456 | 3.631 |
| 0.695 | −0.448 | 3.631 | −1.423 | 0.434 | 3.631 | 1.615 | −0.476 | 3.631 |
| 0.590 | −0.428 | 3.631 | −1.407 | 0.435 | 3.631 | 1.673 | −0.494 | 3.631 |
| 0.484 | −0.407 | 3.631 | −1.386 | 0.432 | 3.631 | 1.723 | −0.510 | 3.631 |
| 0.380 | −0.385 | 3.631 | −1.358 | 0.426 | 3.631 | 1.767 | −0.524 | 3.631 |
| 0.275 | −0.361 | 3.631 | −1.324 | 0.418 | 3.631 | 1.804 | −0.535 | 3.631 |
| 0.171 | −0.335 | 3.631 | −1.279 | 0.406 | 3.631 | 1.836 | −0.545 | 3.631 |
| 0.067 | −0.307 | 3.631 | −1.228 | 0.393 | 3.631 | 1.863 | −0.553 | 3.631 |
| −0.036 | −0.277 | 3.631 | −1.173 | 0.378 | 3.631 | 1.885 | −0.559 | 3.631 |
| −0.139 | −0.244 | 3.631 | −1.112 | 0.361 | 3.631 | 1.903 | −0.565 | 3.631 |
| −0.241 | −0.210 | 3.631 | −1.044 | 0.342 | 3.631 | 1.916 | −0.569 | 3.631 |
| −0.343 | −0.173 | 3.631 | −0.969 | 0.321 | 3.631 | 1.926 | −0.574 | 3.631 |
| −0.444 | −0.134 | 3.631 | −0.891 | 0.299 | 3.631 | 1.931 | −0.581 | 3.631 |
| −0.541 | −0.095 | 3.631 | −0.809 | 0.275 | 3.631 | 1.932 | −0.587 | 3.631 |
| −0.634 | −0.055 | 3.631 | −0.724 | 0.251 | 3.631 | | | |
| −0.722 | −0.015 | 3.631 | −0.635 | 0.226 | 3.631 | | | |
| 1.931 | −0.602 | 3.994 | −0.804 | 0.022 | 3.994 | −0.544 | 0.190 | 3.994 |
| 1.929 | −0.607 | 3.994 | −0.885 | 0.062 | 3.994 | −0.448 | 0.163 | 3.994 |
| 1.925 | −0.613 | 3.994 | −0.962 | 0.101 | 3.994 | −0.350 | 0.135 | 3.994 |
| 1.917 | −0.617 | 3.994 | −1.036 | 0.139 | 3.994 | −0.248 | 0.105 | 3.994 |
| 1.906 | −0.617 | 3.994 | −1.105 | 0.178 | 3.994 | −0.146 | 0.076 | 3.994 |
| 1.892 | −0.615 | 3.994 | −1.168 | 0.213 | 3.994 | −0.044 | 0.047 | 3.994 |
| 1.873 | −0.614 | 3.994 | −1.224 | 0.246 | 3.994 | 0.058 | 0.017 | 3.994 |
| 1.850 | −0.611 | 3.994 | −1.273 | 0.277 | 3.994 | 0.160 | −0.013 | 3.994 |
| 1.822 | −0.608 | 3.994 | −1.318 | 0.306 | 3.994 | 0.262 | −0.044 | 3.994 |
| 1.788 | −0.604 | 3.994 | −1.357 | 0.332 | 3.994 | 0.363 | −0.075 | 3.994 |
| 1.749 | −0.600 | 3.994 | −1.386 | 0.353 | 3.994 | 0.464 | −0.107 | 3.994 |
| 1.703 | −0.595 | 3.994 | −1.409 | 0.370 | 3.994 | 0.565 | −0.140 | 3.994 |
| 1.649 | −0.589 | 3.994 | −1.425 | 0.385 | 3.994 | 0.666 | −0.173 | 3.994 |
| 1.589 | −0.582 | 3.994 | −1.436 | 0.397 | 3.994 | 0.767 | −0.206 | 3.994 |
| 1.521 | −0.574 | 3.994 | −1.439 | 0.405 | 3.994 | 0.868 | −0.240 | 3.994 |
| 1.446 | −0.564 | 3.994 | −1.441 | 0.411 | 3.994 | 0.965 | −0.272 | 3.994 |
| 1.365 | −0.554 | 3.994 | −1.440 | 0.414 | 3.994 | 1.059 | −0.304 | 3.994 |
| 1.279 | −0.544 | 3.994 | −1.440 | 0.415 | 3.994 | 1.149 | −0.335 | 3.994 |
| 1.190 | −0.532 | 3.994 | −1.440 | 0.416 | 3.994 | 1.236 | −0.364 | 3.994 |
| 1.098 | −0.520 | 3.994 | −1.439 | 0.417 | 3.994 | 1.320 | −0.392 | 3.994 |
| 1.002 | −0.506 | 3.994 | −1.438 | 0.418 | 3.994 | 1.401 | −0.419 | 3.994 |
| 0.903 | −0.491 | 3.994 | −1.436 | 0.420 | 3.994 | 1.478 | −0.444 | 3.994 |

TABLE 11R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.801 | −0.475 | 3.994 | −1.431 | 0.423 | 3.994 | 1.549 | −0.467 | 3.994 |
| 0.695 | −0.456 | 3.994 | −1.423 | 0.425 | 3.994 | 1.613 | −0.487 | 3.994 |
| 0.590 | −0.436 | 3.994 | −1.407 | 0.425 | 3.994 | 1.670 | −0.505 | 3.994 |
| 0.485 | −0.415 | 3.994 | −1.386 | 0.423 | 3.994 | 1.721 | −0.521 | 3.994 |
| 0.380 | −0.392 | 3.994 | −1.358 | 0.417 | 3.994 | 1.765 | −0.534 | 3.994 |
| 0.276 | −0.367 | 3.994 | −1.324 | 0.409 | 3.994 | 1.802 | −0.546 | 3.994 |
| 0.172 | −0.340 | 3.994 | −1.279 | 0.397 | 3.994 | 1.834 | −0.555 | 3.994 |
| 0.068 | −0.312 | 3.994 | −1.228 | 0.384 | 3.994 | 1.861 | −0.563 | 3.994 |
| −0.035 | −0.281 | 3.994 | −1.173 | 0.369 | 3.994 | 1.883 | −0.570 | 3.994 |
| −0.137 | −0.247 | 3.994 | −1.112 | 0.352 | 3.994 | 1.901 | −0.575 | 3.994 |
| −0.239 | −0.212 | 3.994 | −1.044 | 0.333 | 3.994 | 1.914 | −0.579 | 3.994 |
| −0.341 | −0.175 | 3.994 | −0.969 | 0.311 | 3.994 | 1.924 | −0.584 | 3.994 |
| −0.441 | −0.136 | 3.994 | −0.891 | 0.289 | 3.994 | 1.929 | −0.590 | 3.994 |
| −0.538 | −0.097 | 3.994 | −0.809 | 0.266 | 3.994 | 1.931 | −0.597 | 3.994 |
| −0.631 | −0.057 | 3.994 | −0.724 | 0.241 | 3.994 | | | |
| −0.720 | −0.017 | 3.994 | −0.635 | 0.216 | 3.994 | | | |
| 1.919 | −0.577 | 4.720 | −0.816 | 0.016 | 4.720 | −0.568 | 0.160 | 4.720 |
| 1.917 | −0.582 | 4.720 | −0.898 | 0.054 | 4.720 | −0.473 | 0.133 | 4.720 |
| 1.913 | −0.588 | 4.720 | −0.975 | 0.092 | 4.720 | −0.374 | 0.106 | 4.720 |
| 1.905 | −0.591 | 4.720 | −1.049 | 0.129 | 4.720 | −0.272 | 0.078 | 4.720 |
| 1.894 | −0.591 | 4.720 | −1.119 | 0.165 | 4.720 | −0.169 | 0.050 | 4.720 |
| 1.880 | −0.590 | 4.720 | −1.182 | 0.199 | 4.720 | −0.067 | 0.022 | 4.720 |
| 1.861 | −0.589 | 4.720 | −1.239 | 0.231 | 4.720 | 0.035 | −0.005 | 4.720 |
| 1.838 | −0.587 | 4.720 | −1.289 | 0.259 | 4.720 | 0.137 | −0.033 | 4.720 |
| 1.810 | −0.584 | 4.720 | −1.335 | 0.287 | 4.720 | 0.239 | −0.061 | 4.720 |
| 1.777 | −0.581 | 4.720 | −1.374 | 0.312 | 4.720 | 0.341 | −0.089 | 4.720 |
| 1.737 | −0.578 | 4.720 | −1.404 | 0.332 | 4.720 | 0.443 | −0.118 | 4.720 |
| 1.691 | −0.574 | 4.720 | −1.428 | 0.348 | 4.720 | 0.545 | −0.148 | 4.720 |
| 1.638 | −0.570 | 4.720 | −1.445 | 0.361 | 4.720 | 0.647 | −0.178 | 4.720 |
| 1.577 | −0.564 | 4.720 | −1.456 | 0.373 | 4.720 | 0.748 | −0.209 | 4.720 |
| 1.509 | −0.558 | 4.720 | −1.460 | 0.381 | 4.720 | 0.849 | −0.240 | 4.720 |
| 1.435 | −0.551 | 4.720 | −1.462 | 0.387 | 4.720 | 0.947 | −0.270 | 4.720 |
| 1.353 | −0.542 | 4.720 | −1.461 | 0.389 | 4.720 | 1.041 | −0.300 | 4.720 |
| 1.267 | −0.534 | 4.720 | −1.461 | 0.391 | 4.720 | 1.132 | −0.329 | 4.720 |
| 1.178 | −0.524 | 4.720 | −1.461 | 0.392 | 4.720 | 1.220 | −0.356 | 4.720 |
| 1.086 | −0.513 | 4.720 | −1.460 | 0.392 | 4.720 | 1.304 | −0.382 | 4.720 |
| 0.990 | −0.501 | 4.720 | −1.460 | 0.393 | 4.720 | 1.385 | −0.407 | 4.720 |
| 0.891 | −0.487 | 4.720 | −1.458 | 0.395 | 4.720 | 1.463 | −0.431 | 4.720 |
| 0.789 | −0.472 | 4.720 | −1.453 | 0.398 | 4.720 | 1.534 | −0.452 | 4.720 |
| 0.684 | −0.454 | 4.720 | −1.444 | 0.400 | 4.720 | 1.598 | −0.471 | 4.720 |
| 0.578 | −0.435 | 4.720 | −1.428 | 0.400 | 4.720 | 1.656 | −0.488 | 4.720 |
| 0.473 | −0.414 | 4.720 | −1.407 | 0.396 | 4.720 | 1.707 | −0.503 | 4.720 |
| 0.369 | −0.391 | 4.720 | −1.379 | 0.390 | 4.720 | 1.751 | −0.515 | 4.720 |
| 0.265 | −0.366 | 4.720 | −1.345 | 0.382 | 4.720 | 1.788 | −0.525 | 4.720 |
| 0.161 | −0.339 | 4.720 | −1.301 | 0.370 | 4.720 | 1.820 | −0.534 | 4.720 |
| 0.057 | −0.310 | 4.720 | −1.250 | 0.356 | 4.720 | 1.847 | −0.541 | 4.720 |
| −0.046 | −0.279 | 4.720 | −1.195 | 0.341 | 4.720 | 1.869 | −0.547 | 4.720 |
| −0.148 | −0.246 | 4.720 | −1.134 | 0.323 | 4.720 | 1.887 | −0.552 | 4.720 |
| −0.250 | −0.212 | 4.720 | −1.066 | 0.304 | 4.720 | 1.901 | −0.556 | 4.720 |
| −0.352 | −0.175 | 4.720 | −0.992 | 0.282 | 4.720 | 1.911 | −0.559 | 4.720 |
| −0.452 | −0.137 | 4.720 | −0.914 | 0.259 | 4.720 | 1.917 | −0.565 | 4.720 |
| −0.549 | −0.099 | 4.720 | −0.832 | 0.236 | 4.720 | 1.919 | −0.572 | 4.720 |
| −0.642 | −0.061 | 4.720 | −0.748 | 0.211 | 4.720 | | | |
| −0.731 | −0.022 | 4.720 | −0.659 | 0.186 | 4.720 | | | |
| 1.868 | −0.529 | 5.446 | −0.874 | 0.065 | 5.446 | −0.636 | 0.153 | 5.446 |
| 1.866 | −0.534 | 5.446 | −0.954 | 0.105 | 5.446 | −0.542 | 0.124 | 5.446 |
| 1.861 | −0.540 | 5.446 | −1.031 | 0.145 | 5.446 | −0.444 | 0.094 | 5.446 |
| 1.853 | −0.543 | 5.446 | −1.103 | 0.185 | 5.446 | −0.342 | 0.064 | 5.446 |
| 1.842 | −0.543 | 5.446 | −1.172 | 0.224 | 5.446 | −0.240 | 0.035 | 5.446 |
| 1.828 | −0.542 | 5.446 | −1.234 | 0.260 | 5.446 | −0.138 | 0.007 | 5.446 |
| 1.809 | −0.541 | 5.446 | −1.289 | 0.294 | 5.446 | −0.036 | −0.021 | 5.446 |
| 1.786 | −0.540 | 5.446 | −1.338 | 0.325 | 5.446 | 0.067 | −0.047 | 5.446 |
| 1.758 | −0.539 | 5.446 | −1.383 | 0.355 | 5.446 | 0.169 | −0.073 | 5.446 |
| 1.724 | −0.537 | 5.446 | −1.421 | 0.382 | 5.446 | 0.272 | −0.098 | 5.446 |
| 1.684 | −0.534 | 5.446 | −1.451 | 0.403 | 5.446 | 0.375 | −0.124 | 5.446 |
| 1.638 | −0.531 | 5.446 | −1.474 | 0.420 | 5.446 | 0.478 | −0.149 | 5.446 |
| 1.584 | −0.528 | 5.446 | −1.490 | 0.434 | 5.446 | 0.581 | −0.175 | 5.446 |
| 1.523 | −0.524 | 5.446 | −1.501 | 0.446 | 5.446 | 0.684 | −0.201 | 5.446 |
| 1.455 | −0.520 | 5.446 | −1.506 | 0.454 | 5.446 | 0.786 | −0.228 | 5.446 |
| 1.380 | −0.515 | 5.446 | −1.507 | 0.459 | 5.446 | 0.885 | −0.255 | 5.446 |
| 1.297 | −0.509 | 5.446 | −1.507 | 0.462 | 5.446 | 0.980 | −0.281 | 5.446 |
| 1.212 | −0.502 | 5.446 | −1.507 | 0.463 | 5.446 | 1.072 | −0.307 | 5.446 |
| 1.122 | −0.493 | 5.446 | −1.506 | 0.464 | 5.446 | 1.161 | −0.332 | 5.446 |
| 1.030 | −0.484 | 5.446 | −1.506 | 0.465 | 5.446 | 1.246 | −0.355 | 5.446 |
| 0.933 | −0.473 | 5.446 | −1.505 | 0.466 | 5.446 | 1.327 | −0.378 | 5.446 |
| 0.834 | −0.460 | 5.446 | −1.503 | 0.467 | 5.446 | 1.406 | −0.399 | 5.446 |
| 0.731 | −0.445 | 5.446 | −1.497 | 0.469 | 5.446 | 1.477 | −0.418 | 5.446 |

TABLE 11R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.625 | −0.427 | 5.446 | −1.488 | 0.469 | 5.446 | 1.542 | −0.435 | 5.446 |
| 0.519 | −0.407 | 5.446 | −1.473 | 0.466 | 5.446 | 1.601 | −0.450 | 5.446 |
| 0.414 | −0.386 | 5.446 | −1.452 | 0.459 | 5.446 | 1.652 | −0.463 | 5.446 |
| 0.308 | −0.361 | 5.446 | −1.426 | 0.449 | 5.446 | 1.697 | −0.473 | 5.446 |
| 0.204 | −0.335 | 5.446 | −1.393 | 0.435 | 5.446 | 1.734 | −0.482 | 5.446 |
| 0.100 | −0.307 | 5.446 | −1.351 | 0.418 | 5.446 | 1.767 | −0.490 | 5.446 |
| −0.004 | −0.277 | 5.446 | −1.302 | 0.398 | 5.446 | 1.794 | −0.496 | 5.446 |
| −0.107 | −0.244 | 5.446 | −1.249 | 0.377 | 5.446 | 1.816 | −0.501 | 5.446 |
| −0.209 | −0.210 | 5.446 | −1.190 | 0.353 | 5.446 | 1.834 | −0.505 | 5.446 |
| −0.311 | −0.174 | 5.446 | −1.125 | 0.327 | 5.446 | 1.848 | −0.508 | 5.446 |
| −0.412 | −0.137 | 5.446 | −1.052 | 0.300 | 5.446 | 1.858 | −0.511 | 5.446 |
| −0.513 | −0.097 | 5.446 | −0.976 | 0.271 | 5.446 | 1.865 | −0.517 | 5.446 |
| −0.609 | −0.057 | 5.446 | −0.896 | 0.242 | 5.446 | 1.868 | −0.524 | 5.446 |
| −0.701 | −0.017 | 5.446 | −0.813 | 0.213 | 5.446 | | | |
| −0.790 | 0.024 | 5.446 | −0.726 | 0.183 | 5.446 | | | |
| 1.822 | −0.521 | 5.809 | −0.913 | 0.132 | 5.809 | −0.686 | 0.179 | 5.809 |
| 1.821 | −0.526 | 5.809 | −0.991 | 0.177 | 5.809 | −0.593 | 0.143 | 5.809 |
| 1.816 | −0.532 | 5.809 | −1.066 | 0.222 | 5.809 | −0.497 | 0.107 | 5.809 |
| 1.808 | −0.535 | 5.809 | −1.136 | 0.267 | 5.809 | −0.396 | 0.072 | 5.809 |
| 1.797 | −0.535 | 5.809 | −1.203 | 0.310 | 5.809 | −0.296 | 0.038 | 5.809 |
| 1.783 | −0.535 | 5.809 | −1.263 | 0.351 | 5.809 | −0.194 | 0.006 | 5.809 |
| 1.764 | −0.534 | 5.809 | −1.317 | 0.389 | 5.809 | −0.092 | −0.025 | 5.809 |
| 1.740 | −0.533 | 5.809 | −1.364 | 0.423 | 5.809 | 0.010 | −0.055 | 5.809 |
| 1.712 | −0.532 | 5.809 | −1.407 | 0.456 | 5.809 | 0.112 | −0.083 | 5.809 |
| 1.678 | −0.531 | 5.809 | −1.444 | 0.485 | 5.809 | 0.215 | −0.110 | 5.809 |
| 1.638 | −0.529 | 5.809 | −1.473 | 0.508 | 5.809 | 0.318 | −0.136 | 5.809 |
| 1.591 | −0.527 | 5.809 | −1.495 | 0.526 | 5.809 | 0.422 | −0.161 | 5.809 |
| 1.537 | −0.524 | 5.809 | −1.511 | 0.541 | 5.809 | 0.525 | −0.186 | 5.809 |
| 1.475 | −0.521 | 5.809 | −1.522 | 0.553 | 5.809 | 0.629 | −0.211 | 5.809 |
| 1.407 | −0.517 | 5.809 | −1.526 | 0.561 | 5.809 | 0.732 | −0.237 | 5.809 |
| 1.331 | −0.513 | 5.809 | −1.527 | 0.567 | 5.809 | 0.832 | −0.262 | 5.809 |
| 1.247 | −0.508 | 5.809 | −1.527 | 0.570 | 5.809 | 0.928 | −0.287 | 5.809 |
| 1.161 | −0.501 | 5.809 | −1.526 | 0.571 | 5.809 | 1.021 | −0.311 | 5.809 |
| 1.071 | −0.493 | 5.809 | −1.526 | 0.572 | 5.809 | 1.110 | −0.334 | 5.809 |
| 0.978 | −0.484 | 5.809 | −1.526 | 0.572 | 5.809 | 1.196 | −0.357 | 5.809 |
| 0.881 | −0.472 | 5.809 | −1.524 | 0.573 | 5.809 | 1.278 | −0.378 | 5.809 |
| 0.782 | −0.458 | 5.809 | −1.522 | 0.575 | 5.809 | 1.357 | −0.399 | 5.809 |
| 0.679 | −0.442 | 5.809 | −1.516 | 0.575 | 5.809 | 1.429 | −0.417 | 5.809 |
| 0.573 | −0.423 | 5.809 | −1.507 | 0.574 | 5.809 | 1.495 | −0.433 | 5.809 |
| 0.467 | −0.401 | 5.809 | −1.492 | 0.569 | 5.809 | 1.553 | −0.447 | 5.809 |
| 0.362 | −0.376 | 5.809 | −1.473 | 0.559 | 5.809 | 1.605 | −0.458 | 5.809 |
| 0.258 | −0.349 | 5.809 | −1.449 | 0.545 | 5.809 | 1.650 | −0.468 | 5.809 |
| 0.154 | −0.319 | 5.809 | −1.418 | 0.528 | 5.809 | 1.688 | −0.477 | 5.809 |
| 0.050 | −0.287 | 5.809 | −1.377 | 0.506 | 5.809 | 1.721 | −0.484 | 5.809 |
| −0.053 | −0.253 | 5.809 | −1.330 | 0.481 | 5.809 | 1.748 | −0.490 | 5.809 |
| −0.156 | −0.217 | 5.809 | −1.280 | 0.455 | 5.809 | 1.771 | −0.494 | 5.809 |
| −0.258 | −0.178 | 5.809 | −1.223 | 0.425 | 5.809 | 1.789 | −0.498 | 5.809 |
| −0.359 | −0.138 | 5.809 | −1.160 | 0.393 | 5.809 | 1.803 | −0.501 | 5.809 |
| −0.459 | −0.095 | 5.809 | −1.090 | 0.358 | 5.809 | 1.813 | −0.504 | 5.809 |
| −0.558 | −0.051 | 5.809 | −1.017 | 0.323 | 5.809 | 1.820 | −0.509 | 5.809 |
| −0.653 | −0.006 | 5.809 | −0.940 | 0.287 | 5.809 | 1.822 | −0.516 | 5.809 |
| −0.743 | 0.040 | 5.809 | −0.859 | 0.251 | 5.809 | | | |
| −0.830 | 0.086 | 5.809 | −0.774 | 0.215 | 5.809 | | | |

The coordinate values given in TABLE 12R below provide the nominal profile envelope for an exemplary twelfth stage rotor.

TABLE 12R

| X-LOC | Y-LOC | Z-LOC | X-LOC | Y-LOC | Z-LOC | X-LOC | Y-LOC | Z-LOC |
|---|---|---|---|---|---|---|---|---|
| 2.002 | −0.178 | 0.000 | −0.868 | −0.126 | 0.000 | −0.589 | 0.114 | 0.000 |
| 2.002 | −0.183 | 0.000 | −0.954 | −0.089 | 0.000 | −0.490 | 0.097 | 0.000 |
| 2.000 | −0.191 | 0.000 | −1.035 | −0.052 | 0.000 | −0.388 | 0.080 | 0.000 |
| 1.997 | −0.199 | 0.000 | −1.112 | −0.014 | 0.000 | −0.282 | 0.064 | 0.000 |
| 1.990 | −0.208 | 0.000 | −1.184 | 0.026 | 0.000 | −0.176 | 0.049 | 0.000 |
| 1.978 | −0.216 | 0.000 | −1.249 | 0.064 | 0.000 | −0.070 | 0.036 | 0.000 |
| 1.959 | −0.219 | 0.000 | −1.305 | 0.101 | 0.000 | 0.036 | 0.023 | 0.000 |
| 1.935 | −0.221 | 0.000 | −1.354 | 0.135 | 0.000 | 0.142 | 0.010 | 0.000 |
| 1.906 | −0.224 | 0.000 | −1.398 | 0.170 | 0.000 | 0.249 | −0.002 | 0.000 |
| 1.871 | −0.226 | 0.000 | −1.435 | 0.202 | 0.000 | 0.355 | −0.013 | 0.000 |
| 1.831 | −0.230 | 0.000 | −1.461 | 0.228 | 0.000 | 0.461 | −0.023 | 0.000 |

TABLE 12R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.783 | −0.233 | 0.000 | −1.481 | 0.251 | 0.000 | 0.568 | −0.034 | 0.000 |
| 1.728 | −0.238 | 0.000 | −1.493 | 0.270 | 0.000 | 0.674 | −0.044 | 0.000 |
| 1.665 | −0.242 | 0.000 | −1.500 | 0.285 | 0.000 | 0.781 | −0.054 | 0.000 |
| 1.595 | −0.248 | 0.000 | −1.502 | 0.294 | 0.000 | 0.887 | −0.063 | 0.000 |
| 1.518 | −0.254 | 0.000 | −1.502 | 0.300 | 0.000 | 0.990 | −0.071 | 0.000 |
| 1.433 | −0.260 | 0.000 | −1.501 | 0.303 | 0.000 | 1.090 | −0.079 | 0.000 |
| 1.344 | −0.266 | 0.000 | −1.500 | 0.304 | 0.000 | 1.186 | −0.086 | 0.000 |
| 1.252 | −0.273 | 0.000 | −1.500 | 0.305 | 0.000 | 1.278 | −0.093 | 0.000 |
| 1.156 | −0.280 | 0.000 | −1.499 | 0.305 | 0.000 | 1.367 | −0.099 | 0.000 |
| 1.057 | −0.286 | 0.000 | −1.499 | 0.307 | 0.000 | 1.453 | −0.105 | 0.000 |
| 0.954 | −0.293 | 0.000 | −1.497 | 0.309 | 0.000 | 1.535 | −0.110 | 0.000 |
| 0.847 | −0.300 | 0.000 | −1.492 | 0.312 | 0.000 | 1.609 | −0.115 | 0.000 |
| 0.736 | −0.306 | 0.000 | −1.483 | 0.315 | 0.000 | 1.677 | −0.120 | 0.000 |
| 0.625 | −0.312 | 0.000 | −1.467 | 0.317 | 0.000 | 1.737 | −0.123 | 0.000 |
| 0.515 | −0.317 | 0.000 | −1.446 | 0.316 | 0.000 | 1.791 | −0.127 | 0.000 |
| 0.404 | −0.320 | 0.000 | −1.418 | 0.312 | 0.000 | 1.837 | −0.130 | 0.000 |
| 0.294 | −0.320 | 0.000 | −1.383 | 0.305 | 0.000 | 1.876 | −0.132 | 0.000 |
| 0.184 | −0.319 | 0.000 | −1.338 | 0.295 | 0.000 | 1.910 | −0.134 | 0.000 |
| 0.073 | −0.316 | 0.000 | −1.286 | 0.281 | 0.000 | 1.938 | −0.136 | 0.000 |
| −0.037 | −0.309 | 0.000 | −1.231 | 0.265 | 0.000 | 1.961 | −0.137 | 0.000 |
| −0.147 | −0.299 | 0.000 | −1.169 | 0.248 | 0.000 | 1.979 | −0.141 | 0.000 |
| −0.256 | −0.285 | 0.000 | −1.100 | 0.229 | 0.000 | 1.990 | −0.149 | 0.000 |
| −0.366 | −0.267 | 0.000 | −1.024 | 0.209 | 0.000 | 1.997 | −0.158 | 0.000 |
| −0.476 | −0.245 | 0.000 | −0.945 | 0.189 | 0.000 | 2.001 | −0.166 | 0.000 |
| −0.581 | −0.220 | 0.000 | −0.861 | 0.170 | 0.000 | 2.002 | −0.173 | 0.000 |
| −0.681 | −0.191 | 0.000 | −0.774 | 0.150 | 0.000 | | | |
| −0.777 | −0.160 | 0.000 | −0.683 | 0.132 | 0.000 | | | |
| 1.985 | −0.218 | 0.563 | −0.854 | −0.100 | 0.563 | −0.596 | 0.122 | 0.563 |
| 1.985 | −0.223 | 0.563 | −0.942 | −0.067 | 0.563 | −0.498 | 0.104 | 0.563 |
| 1.983 | −0.230 | 0.563 | −1.024 | −0.032 | 0.563 | −0.396 | 0.086 | 0.563 |
| 1.979 | −0.238 | 0.563 | −1.102 | 0.003 | 0.563 | −0.291 | 0.069 | 0.563 |
| 1.972 | −0.247 | 0.563 | −1.176 | 0.039 | 0.563 | −0.185 | 0.052 | 0.563 |
| 1.960 | −0.255 | 0.563 | −1.242 | 0.074 | 0.563 | −0.079 | 0.037 | 0.563 |
| 1.941 | −0.258 | 0.563 | −1.300 | 0.107 | 0.563 | 0.026 | 0.023 | 0.563 |
| 1.918 | −0.259 | 0.563 | −1.351 | 0.139 | 0.563 | 0.132 | 0.009 | 0.563 |
| 1.889 | −0.260 | 0.563 | −1.397 | 0.170 | 0.563 | 0.238 | −0.005 | 0.563 |
| 1.854 | −0.262 | 0.563 | −1.436 | 0.200 | 0.563 | 0.344 | −0.018 | 0.563 |
| 1.814 | −0.263 | 0.563 | −1.464 | 0.224 | 0.563 | 0.450 | −0.030 | 0.563 |
| 1.767 | −0.265 | 0.563 | −1.485 | 0.245 | 0.563 | 0.556 | −0.042 | 0.563 |
| 1.712 | −0.267 | 0.563 | −1.499 | 0.263 | 0.563 | 0.663 | −0.054 | 0.563 |
| 1.650 | −0.269 | 0.563 | −1.507 | 0.278 | 0.563 | 0.769 | −0.066 | 0.563 |
| 1.580 | −0.272 | 0.563 | −1.509 | 0.287 | 0.563 | 0.875 | −0.078 | 0.563 |
| 1.503 | −0.274 | 0.563 | −1.509 | 0.293 | 0.563 | 0.978 | −0.088 | 0.563 |
| 1.419 | −0.277 | 0.563 | −1.509 | 0.295 | 0.563 | 1.077 | −0.098 | 0.563 |
| 1.331 | −0.280 | 0.563 | −1.508 | 0.297 | 0.563 | 1.173 | −0.107 | 0.563 |
| 1.240 | −0.283 | 0.563 | −1.508 | 0.298 | 0.563 | 1.265 | −0.116 | 0.563 |
| 1.145 | −0.285 | 0.563 | −1.507 | 0.298 | 0.563 | 1.353 | −0.124 | 0.563 |
| 1.046 | −0.288 | 0.563 | −1.507 | 0.299 | 0.563 | 1.439 | −0.132 | 0.563 |
| 0.944 | −0.290 | 0.563 | −1.505 | 0.302 | 0.563 | 1.520 | −0.139 | 0.563 |
| 0.838 | −0.293 | 0.563 | −1.500 | 0.305 | 0.563 | 1.595 | −0.145 | 0.563 |
| 0.728 | −0.295 | 0.563 | −1.492 | 0.309 | 0.563 | 1.662 | −0.151 | 0.563 |
| 0.618 | −0.297 | 0.563 | −1.476 | 0.312 | 0.563 | 1.722 | −0.157 | 0.563 |
| 0.509 | −0.298 | 0.563 | −1.455 | 0.312 | 0.563 | 1.776 | −0.161 | 0.563 |
| 0.399 | −0.297 | 0.563 | −1.426 | 0.310 | 0.563 | 1.822 | −0.165 | 0.563 |
| 0.290 | −0.295 | 0.563 | −1.391 | 0.304 | 0.563 | 1.861 | −0.168 | 0.563 |
| 0.181 | −0.291 | 0.563 | −1.346 | 0.295 | 0.563 | 1.894 | −0.171 | 0.563 |
| 0.072 | −0.285 | 0.563 | −1.294 | 0.283 | 0.563 | 1.922 | −0.173 | 0.563 |
| −0.036 | −0.277 | 0.563 | −1.238 | 0.269 | 0.563 | 1.945 | −0.175 | 0.563 |
| −0.144 | −0.265 | 0.563 | −1.176 | 0.253 | 0.563 | 1.963 | −0.180 | 0.563 |
| −0.252 | −0.251 | 0.563 | −1.107 | 0.235 | 0.563 | 1.974 | −0.189 | 0.563 |
| −0.359 | −0.233 | 0.563 | −1.031 | 0.216 | 0.563 | 1.980 | −0.197 | 0.563 |
| −0.466 | −0.212 | 0.563 | −0.951 | 0.197 | 0.563 | 1.984 | −0.205 | 0.563 |
| −0.569 | −0.187 | 0.563 | −0.868 | 0.178 | 0.563 | 1.985 | −0.212 | 0.563 |
| −0.668 | −0.160 | 0.563 | −0.781 | 0.159 | 0.563 | | | |
| −0.763 | −0.131 | 0.563 | −0.690 | 0.140 | 0.563 | | | |
| 1.965 | −0.310 | 1.189 | −0.839 | −0.080 | 1.189 | −0.585 | 0.117 | 1.189 |
| 1.964 | −0.315 | 1.189 | −0.924 | −0.048 | 1.189 | −0.488 | 0.097 | 1.189 |
| 1.962 | −0.322 | 1.189 | −1.006 | −0.015 | 1.189 | −0.387 | 0.078 | 1.189 |
| 1.958 | −0.330 | 1.189 | −1.083 | 0.018 | 1.189 | −0.283 | 0.058 | 1.189 |
| 1.951 | −0.338 | 1.189 | −1.156 | 0.052 | 1.189 | −0.179 | 0.040 | 1.189 |
| 1.938 | −0.345 | 1.189 | −1.221 | 0.085 | 1.189 | −0.074 | 0.022 | 1.189 |
| 1.920 | −0.348 | 1.189 | −1.279 | 0.116 | 1.189 | 0.030 | 0.005 | 1.189 |
| 1.896 | −0.347 | 1.189 | −1.330 | 0.145 | 1.189 | 0.135 | −0.012 | 1.189 |
| 1.868 | −0.347 | 1.189 | −1.376 | 0.173 | 1.189 | 0.240 | −0.028 | 1.189 |
| 1.834 | −0.347 | 1.189 | −1.415 | 0.201 | 1.189 | 0.345 | −0.045 | 1.189 |
| 1.794 | −0.346 | 1.189 | −1.444 | 0.223 | 1.189 | 0.450 | −0.061 | 1.189 |
| 1.747 | −0.346 | 1.189 | −1.465 | 0.243 | 1.189 | 0.555 | −0.077 | 1.189 |

TABLE 12R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.693 | −0.345 | 1.189 | −1.480 | 0.260 | 1.189 | 0.659 | −0.093 | 1.189 |
| 1.632 | −0.344 | 1.189 | −1.488 | 0.274 | 1.189 | 0.764 | −0.108 | 1.189 |
| 1.563 | −0.343 | 1.189 | −1.491 | 0.283 | 1.189 | 0.869 | −0.124 | 1.189 |
| 1.487 | −0.341 | 1.189 | −1.491 | 0.288 | 1.189 | 0.971 | −0.139 | 1.189 |
| 1.404 | −0.339 | 1.189 | −1.491 | 0.291 | 1.189 | 1.069 | −0.153 | 1.189 |
| 1.318 | −0.337 | 1.189 | −1.490 | 0.293 | 1.189 | 1.163 | −0.166 | 1.189 |
| 1.227 | −0.335 | 1.189 | −1.490 | 0.293 | 1.189 | 1.254 | −0.179 | 1.189 |
| 1.134 | −0.332 | 1.189 | −1.490 | 0.294 | 1.189 | 1.342 | −0.190 | 1.189 |
| 1.036 | −0.330 | 1.189 | −1.489 | 0.295 | 1.189 | 1.426 | −0.202 | 1.189 |
| 0.935 | −0.326 | 1.189 | −1.487 | 0.298 | 1.189 | 1.507 | −0.212 | 1.189 |
| 0.830 | −0.323 | 1.189 | −1.483 | 0.301 | 1.189 | 1.580 | −0.221 | 1.189 |
| 0.722 | −0.320 | 1.189 | −1.474 | 0.305 | 1.189 | 1.647 | −0.230 | 1.189 |
| 0.614 | −0.315 | 1.189 | −1.459 | 0.307 | 1.189 | 1.707 | −0.238 | 1.189 |
| 0.506 | −0.310 | 1.189 | −1.437 | 0.308 | 1.189 | 1.759 | −0.245 | 1.189 |
| 0.398 | −0.304 | 1.189 | −1.409 | 0.306 | 1.189 | 1.805 | −0.251 | 1.189 |
| 0.290 | −0.298 | 1.189 | −1.374 | 0.300 | 1.189 | 1.843 | −0.256 | 1.189 |
| 0.183 | −0.289 | 1.189 | −1.329 | 0.292 | 1.189 | 1.876 | −0.260 | 1.189 |
| 0.075 | −0.279 | 1.189 | −1.277 | 0.280 | 1.189 | 1.904 | −0.264 | 1.189 |
| −0.032 | −0.266 | 1.189 | −1.222 | 0.266 | 1.189 | 1.927 | −0.266 | 1.189 |
| −0.138 | −0.251 | 1.189 | −1.161 | 0.251 | 1.189 | 1.944 | −0.272 | 1.189 |
| −0.244 | −0.234 | 1.189 | −1.092 | 0.233 | 1.189 | 1.955 | −0.280 | 1.189 |
| −0.350 | −0.214 | 1.189 | −1.016 | 0.215 | 1.189 | 1.961 | −0.289 | 1.189 |
| −0.456 | −0.191 | 1.189 | −0.937 | 0.195 | 1.189 | 1.964 | −0.298 | 1.189 |
| −0.557 | −0.166 | 1.189 | −0.855 | 0.176 | 1.189 | 1.965 | −0.305 | 1.189 |
| −0.655 | −0.139 | 1.189 | −0.769 | 0.156 | 1.189 | | | |
| −0.749 | −0.110 | 1.189 | −0.679 | 0.137 | 1.189 | | | |
| 1.959 | −0.444 | 1.816 | −0.784 | −0.066 | 1.816 | −0.527 | 0.105 | 1.816 |
| 1.958 | −0.449 | 1.816 | −0.866 | −0.033 | 1.816 | −0.433 | 0.082 | 1.816 |
| 1.956 | −0.456 | 1.816 | −0.944 | 0.001 | 1.816 | −0.334 | 0.059 | 1.816 |
| 1.951 | −0.463 | 1.816 | −1.019 | 0.035 | 1.816 | −0.233 | 0.036 | 1.816 |
| 1.943 | −0.471 | 1.816 | −1.089 | 0.069 | 1.816 | −0.131 | 0.012 | 1.816 |
| 1.930 | −0.476 | 1.816 | −1.152 | 0.101 | 1.816 | −0.029 | −0.010 | 1.816 |
| 1.912 | −0.476 | 1.816 | −1.208 | 0.132 | 1.816 | 0.073 | −0.032 | 1.816 |
| 1.889 | −0.474 | 1.816 | −1.257 | 0.161 | 1.816 | 0.175 | −0.054 | 1.816 |
| 1.861 | −0.472 | 1.816 | −1.302 | 0.190 | 1.816 | 0.277 | −0.076 | 1.816 |
| 1.828 | −0.469 | 1.816 | −1.339 | 0.217 | 1.816 | 0.380 | −0.098 | 1.816 |
| 1.789 | −0.466 | 1.816 | −1.367 | 0.239 | 1.816 | 0.482 | −0.119 | 1.816 |
| 1.743 | −0.462 | 1.816 | −1.388 | 0.258 | 1.816 | 0.584 | −0.141 | 1.816 |
| 1.690 | −0.458 | 1.816 | −1.402 | 0.274 | 1.816 | 0.686 | −0.163 | 1.816 |
| 1.630 | −0.453 | 1.816 | −1.410 | 0.288 | 1.816 | 0.788 | −0.184 | 1.816 |
| 1.563 | −0.448 | 1.816 | −1.413 | 0.296 | 1.816 | 0.891 | −0.205 | 1.816 |
| 1.488 | −0.442 | 1.816 | −1.414 | 0.302 | 1.816 | 0.989 | −0.226 | 1.816 |
| 1.407 | −0.435 | 1.816 | −1.413 | 0.305 | 1.816 | 1.085 | −0.246 | 1.816 |
| 1.322 | −0.428 | 1.816 | −1.413 | 0.306 | 1.816 | 1.177 | −0.264 | 1.816 |
| 1.234 | −0.421 | 1.816 | −1.413 | 0.307 | 1.816 | 1.266 | −0.282 | 1.816 |
| 1.142 | −0.414 | 1.816 | −1.412 | 0.307 | 1.816 | 1.351 | −0.299 | 1.816 |
| 1.047 | −0.406 | 1.816 | −1.412 | 0.308 | 1.816 | 1.433 | −0.314 | 1.816 |
| 0.948 | −0.398 | 1.816 | −1.410 | 0.310 | 1.816 | 1.512 | −0.329 | 1.816 |
| 0.845 | −0.389 | 1.816 | −1.405 | 0.314 | 1.816 | 1.584 | −0.342 | 1.816 |
| 0.739 | −0.379 | 1.816 | −1.397 | 0.316 | 1.816 | 1.649 | −0.354 | 1.816 |
| 0.633 | −0.368 | 1.816 | −1.381 | 0.318 | 1.816 | 1.707 | −0.364 | 1.816 |
| 0.528 | −0.357 | 1.816 | −1.360 | 0.317 | 1.816 | 1.758 | −0.373 | 1.816 |
| 0.422 | −0.345 | 1.816 | −1.332 | 0.314 | 1.816 | 1.803 | −0.381 | 1.816 |
| 0.316 | −0.332 | 1.816 | −1.298 | 0.308 | 1.816 | 1.841 | −0.388 | 1.816 |
| 0.211 | −0.317 | 1.816 | −1.254 | 0.297 | 1.816 | 1.873 | −0.393 | 1.816 |
| 0.106 | −0.301 | 1.816 | −1.204 | 0.284 | 1.816 | 1.900 | −0.398 | 1.816 |
| 0.001 | −0.283 | 1.816 | −1.150 | 0.270 | 1.816 | 1.923 | −0.401 | 1.816 |
| −0.103 | −0.263 | 1.816 | −1.089 | 0.253 | 1.816 | 1.940 | −0.406 | 1.816 |
| −0.207 | −0.240 | 1.816 | −1.022 | 0.234 | 1.816 | 1.950 | −0.415 | 1.816 |
| −0.311 | −0.216 | 1.816 | −0.949 | 0.214 | 1.816 | 1.956 | −0.424 | 1.816 |
| −0.414 | −0.189 | 1.816 | −0.871 | 0.193 | 1.816 | 1.959 | −0.432 | 1.816 |
| −0.512 | −0.160 | 1.816 | −0.791 | 0.172 | 1.816 | 1.959 | −0.439 | 1.816 |
| −0.607 | −0.129 | 1.816 | −0.706 | 0.150 | 1.816 | | | |
| −0.697 | −0.098 | 1.816 | −0.619 | 0.128 | 1.816 | | | |
| 1.960 | −0.608 | 2.442 | −0.689 | −0.064 | 2.442 | −0.436 | 0.084 | 2.442 |
| 1.958 | −0.613 | 2.442 | −0.768 | −0.026 | 2.442 | −0.345 | 0.056 | 2.442 |
| 1.955 | −0.619 | 2.442 | −0.843 | 0.011 | 2.442 | −0.251 | 0.028 | 2.442 |
| 1.949 | −0.625 | 2.442 | −0.914 | 0.049 | 2.442 | −0.153 | −0.001 | 2.442 |
| 1.939 | −0.629 | 2.442 | −0.980 | 0.086 | 2.442 | −0.055 | −0.030 | 2.442 |
| 1.925 | −0.629 | 2.442 | −1.040 | 0.121 | 2.442 | 0.043 | −0.058 | 2.442 |
| 1.907 | −0.626 | 2.442 | −1.094 | 0.155 | 2.442 | 0.141 | −0.086 | 2.442 |
| 1.885 | −0.623 | 2.442 | −1.140 | 0.186 | 2.442 | 0.239 | −0.114 | 2.442 |
| 1.858 | −0.619 | 2.442 | −1.183 | 0.216 | 2.442 | 0.337 | −0.142 | 2.442 |
| 1.826 | −0.614 | 2.442 | −1.218 | 0.244 | 2.442 | 0.436 | −0.170 | 2.442 |
| 1.788 | −0.609 | 2.442 | −1.244 | 0.267 | 2.442 | 0.534 | −0.198 | 2.442 |
| 1.744 | −0.603 | 2.442 | −1.264 | 0.286 | 2.442 | 0.632 | −0.226 | 2.442 |
| 1.693 | −0.595 | 2.442 | −1.278 | 0.303 | 2.442 | 0.730 | −0.254 | 2.442 |

TABLE 12R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.634 | −0.587 | 2.442 | −1.286 | 0.316 | 2.442 | 0.828 | −0.282 | 2.442 |
| 1.569 | −0.579 | 2.442 | −1.289 | 0.324 | 2.442 | 0.926 | −0.310 | 2.442 |
| 1.498 | −0.569 | 2.442 | −1.289 | 0.330 | 2.442 | 1.021 | −0.337 | 2.442 |
| 1.419 | −0.558 | 2.442 | −1.289 | 0.332 | 2.442 | 1.113 | −0.363 | 2.442 |
| 1.337 | −0.548 | 2.442 | −1.288 | 0.334 | 2.442 | 1.201 | −0.388 | 2.442 |
| 1.251 | −0.536 | 2.442 | −1.288 | 0.334 | 2.442 | 1.286 | −0.412 | 2.442 |
| 1.162 | −0.525 | 2.442 | −1.288 | 0.335 | 2.442 | 1.368 | −0.434 | 2.442 |
| 1.069 | −0.512 | 2.442 | −1.287 | 0.336 | 2.442 | 1.447 | −0.455 | 2.442 |
| 0.974 | −0.499 | 2.442 | −1.285 | 0.338 | 2.442 | 1.523 | −0.475 | 2.442 |
| 0.875 | −0.484 | 2.442 | −1.280 | 0.340 | 2.442 | 1.592 | −0.493 | 2.442 |
| 0.772 | −0.469 | 2.442 | −1.271 | 0.342 | 2.442 | 1.655 | −0.509 | 2.442 |
| 0.670 | −0.452 | 2.442 | −1.256 | 0.343 | 2.442 | 1.711 | −0.523 | 2.442 |
| 0.568 | −0.435 | 2.442 | −1.236 | 0.340 | 2.442 | 1.760 | −0.535 | 2.442 |
| 0.466 | −0.417 | 2.442 | −1.209 | 0.335 | 2.442 | 1.803 | −0.545 | 2.442 |
| 0.365 | −0.397 | 2.442 | −1.176 | 0.326 | 2.442 | 1.840 | −0.554 | 2.442 |
| 0.264 | −0.376 | 2.442 | −1.134 | 0.314 | 2.442 | 1.871 | −0.561 | 2.442 |
| 0.163 | −0.353 | 2.442 | −1.085 | 0.298 | 2.442 | 1.897 | −0.567 | 2.442 |
| 0.063 | −0.328 | 2.442 | −1.034 | 0.281 | 2.442 | 1.918 | −0.572 | 2.442 |
| −0.037 | −0.301 | 2.442 | −0.976 | 0.261 | 2.442 | 1.936 | −0.576 | 2.442 |
| −0.137 | −0.272 | 2.442 | −0.912 | 0.238 | 2.442 | 1.948 | −0.581 | 2.442 |
| −0.236 | −0.241 | 2.442 | −0.841 | 0.214 | 2.442 | 1.955 | −0.588 | 2.442 |
| −0.334 | −0.207 | 2.442 | −0.767 | 0.190 | 2.442 | 1.959 | −0.596 | 2.442 |
| −0.429 | −0.172 | 2.442 | −0.689 | 0.164 | 2.442 | 1.960 | −0.603 | 2.442 |
| −0.520 | −0.137 | 2.442 | −0.608 | 0.138 | 2.442 | | | |
| −0.607 | −0.100 | 2.442 | −0.524 | 0.111 | 2.442 | | | |
| 1.954 | −0.718 | 3.069 | −0.622 | −0.080 | 3.069 | −0.374 | 0.050 | 3.069 |
| 1.953 | −0.723 | 3.069 | −0.698 | −0.041 | 3.069 | −0.285 | 0.020 | 3.069 |
| 1.949 | −0.728 | 3.069 | −0.770 | −0.002 | 3.069 | −0.194 | −0.012 | 3.069 |
| 1.942 | −0.734 | 3.069 | −0.838 | 0.036 | 3.069 | −0.099 | −0.044 | 3.069 |
| 1.932 | −0.736 | 3.069 | −0.903 | 0.074 | 3.069 | −0.004 | −0.076 | 3.069 |
| 1.919 | −0.734 | 3.069 | −0.961 | 0.110 | 3.069 | 0.091 | −0.108 | 3.069 |
| 1.902 | −0.731 | 3.069 | −1.013 | 0.143 | 3.069 | 0.186 | −0.140 | 3.069 |
| 1.880 | −0.728 | 3.069 | −1.058 | 0.174 | 3.069 | 0.282 | −0.171 | 3.069 |
| 1.853 | −0.723 | 3.069 | −1.099 | 0.204 | 3.069 | 0.377 | −0.203 | 3.069 |
| 1.822 | −0.718 | 3.069 | −1.134 | 0.231 | 3.069 | 0.472 | −0.235 | 3.069 |
| 1.785 | −0.712 | 3.069 | −1.160 | 0.254 | 3.069 | 0.567 | −0.267 | 3.069 |
| 1.742 | −0.704 | 3.069 | −1.179 | 0.273 | 3.069 | 0.662 | −0.299 | 3.069 |
| 1.692 | −0.696 | 3.069 | −1.193 | 0.288 | 3.069 | 0.757 | −0.331 | 3.069 |
| 1.635 | −0.686 | 3.069 | −1.201 | 0.301 | 3.069 | 0.852 | −0.363 | 3.069 |
| 1.571 | −0.676 | 3.069 | −1.204 | 0.309 | 3.069 | 0.947 | −0.394 | 3.069 |
| 1.501 | −0.664 | 3.069 | −1.204 | 0.314 | 3.069 | 1.039 | −0.424 | 3.069 |
| 1.424 | −0.651 | 3.069 | −1.204 | 0.317 | 3.069 | 1.128 | −0.453 | 3.069 |
| 1.344 | −0.638 | 3.069 | −1.203 | 0.318 | 3.069 | 1.214 | −0.480 | 3.069 |
| 1.260 | −0.625 | 3.069 | −1.203 | 0.319 | 3.069 | 1.297 | −0.507 | 3.069 |
| 1.173 | −0.610 | 3.069 | −1.203 | 0.320 | 3.069 | 1.376 | −0.532 | 3.069 |
| 1.083 | −0.595 | 3.069 | −1.202 | 0.321 | 3.069 | 1.453 | −0.555 | 3.069 |
| 0.990 | −0.578 | 3.069 | −1.200 | 0.322 | 3.069 | 1.527 | −0.577 | 3.069 |
| 0.893 | −0.561 | 3.069 | −1.195 | 0.325 | 3.069 | 1.594 | −0.596 | 3.069 |
| 0.793 | −0.541 | 3.069 | −1.187 | 0.326 | 3.069 | 1.655 | −0.614 | 3.069 |
| 0.694 | −0.521 | 3.069 | −1.172 | 0.326 | 3.069 | 1.710 | −0.629 | 3.069 |
| 0.595 | −0.499 | 3.069 | −1.152 | 0.323 | 3.069 | 1.758 | −0.643 | 3.069 |
| 0.496 | −0.477 | 3.069 | −1.126 | 0.318 | 3.069 | 1.800 | −0.654 | 3.069 |
| 0.397 | −0.452 | 3.069 | −1.094 | 0.309 | 3.069 | 1.836 | −0.664 | 3.069 |
| 0.299 | −0.427 | 3.069 | −1.052 | 0.295 | 3.069 | 1.866 | −0.672 | 3.069 |
| 0.201 | −0.399 | 3.069 | −1.005 | 0.279 | 3.069 | 1.891 | −0.679 | 3.069 |
| 0.104 | −0.370 | 3.069 | −0.955 | 0.261 | 3.069 | 1.912 | −0.684 | 3.069 |
| 0.007 | −0.339 | 3.069 | −0.898 | 0.240 | 3.069 | 1.929 | −0.688 | 3.069 |
| −0.089 | −0.305 | 3.069 | −0.835 | 0.217 | 3.069 | 1.942 | −0.692 | 3.069 |
| −0.185 | −0.270 | 3.069 | −0.767 | 0.191 | 3.069 | 1.950 | −0.699 | 3.069 |
| −0.280 | −0.233 | 3.069 | −0.694 | 0.165 | 3.069 | 1.954 | −0.706 | 3.069 |
| −0.372 | −0.195 | 3.069 | −0.619 | 0.138 | 3.069 | 1.955 | −0.713 | 3.069 |
| −0.459 | −0.157 | 3.069 | −0.540 | 0.109 | 3.069 | | | |
| −0.543 | −0.118 | 3.069 | −0.459 | 0.080 | 3.069 | | | |
| 1.960 | −0.749 | 3.695 | −0.576 | −0.113 | 3.695 | −0.342 | −0.012 | 3.695 |
| 1.958 | −0.754 | 3.695 | −0.651 | −0.076 | 3.695 | −0.255 | −0.043 | 3.695 |
| 1.955 | −0.759 | 3.695 | −0.722 | −0.039 | 3.695 | −0.165 | −0.075 | 3.695 |
| 1.948 | −0.764 | 3.695 | −0.790 | −0.003 | 3.695 | −0.072 | −0.107 | 3.695 |
| 1.938 | −0.766 | 3.695 | −0.854 | 0.033 | 3.695 | 0.022 | −0.139 | 3.695 |
| 1.925 | −0.764 | 3.695 | −0.912 | 0.067 | 3.695 | 0.115 | −0.170 | 3.695 |
| 1.908 | −0.761 | 3.695 | −0.963 | 0.098 | 3.695 | 0.209 | −0.202 | 3.695 |
| 1.886 | −0.757 | 3.695 | −1.008 | 0.127 | 3.695 | 0.303 | −0.233 | 3.695 |
| 1.860 | −0.753 | 3.695 | −1.050 | 0.155 | 3.695 | 0.397 | −0.263 | 3.695 |
| 1.829 | −0.748 | 3.695 | −1.085 | 0.180 | 3.695 | 0.491 | −0.294 | 3.695 |
| 1.793 | −0.741 | 3.695 | −1.112 | 0.201 | 3.695 | 0.585 | −0.325 | 3.695 |
| 1.750 | −0.734 | 3.695 | −1.132 | 0.218 | 3.695 | 0.679 | −0.355 | 3.695 |
| 1.701 | −0.726 | 3.695 | −1.146 | 0.233 | 3.695 | 0.773 | −0.386 | 3.695 |
| 1.645 | −0.716 | 3.695 | −1.155 | 0.245 | 3.695 | 0.867 | −0.416 | 3.695 |

TABLE 12R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.582 | −0.706 | 3.695 | −1.158 | 0.252 | 3.695 | 0.962 | −0.445 | 3.695 |
| 1.513 | −0.694 | 3.695 | −1.159 | 0.257 | 3.695 | 1.053 | −0.474 | 3.695 |
| 1.437 | −0.682 | 3.695 | −1.159 | 0.260 | 3.695 | 1.141 | −0.501 | 3.695 |
| 1.358 | −0.669 | 3.695 | −1.158 | 0.261 | 3.695 | 1.226 | −0.527 | 3.695 |
| 1.276 | −0.655 | 3.695 | −1.158 | 0.262 | 3.695 | 1.308 | −0.551 | 3.695 |
| 1.190 | −0.641 | 3.695 | −1.158 | 0.263 | 3.695 | 1.387 | −0.574 | 3.695 |
| 1.101 | −0.625 | 3.695 | −1.157 | 0.264 | 3.695 | 1.463 | −0.596 | 3.695 |
| 1.009 | −0.608 | 3.695 | −1.155 | 0.265 | 3.695 | 1.536 | −0.617 | 3.695 |
| 0.914 | −0.590 | 3.695 | −1.150 | 0.267 | 3.695 | 1.603 | −0.635 | 3.695 |
| 0.816 | −0.571 | 3.695 | −1.142 | 0.269 | 3.695 | 1.664 | −0.651 | 3.695 |
| 0.718 | −0.550 | 3.695 | −1.127 | 0.268 | 3.695 | 1.718 | −0.666 | 3.695 |
| 0.620 | −0.529 | 3.695 | −1.107 | 0.265 | 3.695 | 1.765 | −0.678 | 3.695 |
| 0.523 | −0.506 | 3.695 | −1.082 | 0.259 | 3.695 | 1.807 | −0.689 | 3.695 |
| 0.426 | −0.481 | 3.695 | −1.050 | 0.249 | 3.695 | 1.842 | −0.698 | 3.695 |
| 0.329 | −0.455 | 3.695 | −1.010 | 0.235 | 3.695 | 1.872 | −0.705 | 3.695 |
| 0.233 | −0.427 | 3.695 | −0.963 | 0.219 | 3.695 | 1.897 | −0.712 | 3.695 |
| 0.137 | −0.398 | 3.695 | −0.914 | 0.200 | 3.695 | 1.918 | −0.717 | 3.695 |
| 0.042 | −0.367 | 3.695 | −0.858 | 0.179 | 3.695 | 1.935 | −0.721 | 3.695 |
| −0.053 | −0.334 | 3.695 | −0.797 | 0.156 | 3.695 | 1.948 | −0.724 | 3.695 |
| −0.147 | −0.299 | 3.695 | −0.729 | 0.130 | 3.695 | 1.955 | −0.730 | 3.695 |
| −0.240 | −0.262 | 3.695 | −0.658 | 0.104 | 3.695 | 1.959 | −0.737 | 3.695 |
| −0.330 | −0.225 | 3.695 | −0.584 | 0.076 | 3.695 | 1.961 | −0.744 | 3.695 |
| −0.415 | −0.188 | 3.695 | −0.506 | 0.047 | 3.695 | | | |
| −0.498 | −0.151 | 3.695 | −0.426 | 0.018 | 3.695 | | | |
| 1.967 | −0.771 | 4.322 | −0.540 | −0.147 | 4.322 | −0.327 | −0.075 | 4.322 |
| 1.966 | −0.776 | 4.322 | −0.615 | −0.113 | 4.322 | −0.241 | −0.105 | 4.322 |
| 1.962 | −0.782 | 4.322 | −0.687 | −0.078 | 4.322 | −0.151 | −0.136 | 4.322 |
| 1.955 | −0.786 | 4.322 | −0.755 | −0.044 | 4.322 | −0.058 | −0.167 | 4.322 |
| 1.945 | −0.788 | 4.322 | −0.820 | −0.011 | 4.322 | 0.035 | −0.198 | 4.322 |
| 1.932 | −0.786 | 4.322 | −0.879 | 0.020 | 4.322 | 0.128 | −0.228 | 4.322 |
| 1.915 | −0.783 | 4.322 | −0.932 | 0.049 | 4.322 | 0.221 | −0.258 | 4.322 |
| 1.894 | −0.779 | 4.322 | −0.978 | 0.075 | 4.322 | 0.315 | −0.287 | 4.322 |
| 1.868 | −0.774 | 4.322 | −1.021 | 0.100 | 4.322 | 0.408 | −0.317 | 4.322 |
| 1.838 | −0.769 | 4.322 | −1.058 | 0.123 | 4.322 | 0.502 | −0.345 | 4.322 |
| 1.802 | −0.762 | 4.322 | −1.085 | 0.142 | 4.322 | 0.596 | −0.374 | 4.322 |
| 1.760 | −0.755 | 4.322 | −1.106 | 0.158 | 4.322 | 0.690 | −0.403 | 4.322 |
| 1.711 | −0.746 | 4.322 | −1.121 | 0.171 | 4.322 | 0.784 | −0.431 | 4.322 |
| 1.656 | −0.736 | 4.322 | −1.131 | 0.182 | 4.322 | 0.878 | −0.458 | 4.322 |
| 1.594 | −0.725 | 4.322 | −1.136 | 0.189 | 4.322 | 0.972 | −0.486 | 4.322 |
| 1.526 | −0.713 | 4.322 | −1.137 | 0.194 | 4.322 | 1.063 | −0.512 | 4.322 |
| 1.451 | −0.699 | 4.322 | −1.137 | 0.197 | 4.322 | 1.151 | −0.537 | 4.322 |
| 1.373 | −0.685 | 4.322 | −1.137 | 0.198 | 4.322 | 1.236 | −0.561 | 4.322 |
| 1.292 | −0.671 | 4.322 | −1.137 | 0.199 | 4.322 | 1.318 | −0.584 | 4.322 |
| 1.207 | −0.655 | 4.322 | −1.136 | 0.199 | 4.322 | 1.397 | −0.605 | 4.322 |
| 1.119 | −0.639 | 4.322 | −1.135 | 0.200 | 4.322 | 1.472 | −0.626 | 4.322 |
| 1.029 | −0.622 | 4.322 | −1.133 | 0.202 | 4.322 | 1.545 | −0.645 | 4.322 |
| 0.935 | −0.604 | 4.322 | −1.128 | 0.204 | 4.322 | 1.611 | −0.662 | 4.322 |
| 0.838 | −0.584 | 4.322 | −1.120 | 0.204 | 4.322 | 1.672 | −0.677 | 4.322 |
| 0.741 | −0.563 | 4.322 | −1.105 | 0.203 | 4.322 | 1.725 | −0.691 | 4.322 |
| 0.645 | −0.542 | 4.322 | −1.086 | 0.200 | 4.322 | 1.773 | −0.703 | 4.322 |
| 0.549 | −0.519 | 4.322 | −1.061 | 0.193 | 4.322 | 1.814 | −0.713 | 4.322 |
| 0.453 | −0.495 | 4.322 | −1.030 | 0.183 | 4.322 | 1.849 | −0.722 | 4.322 |
| 0.358 | −0.470 | 4.322 | −0.990 | 0.169 | 4.322 | 1.879 | −0.729 | 4.322 |
| 0.263 | −0.443 | 4.322 | −0.944 | 0.152 | 4.322 | 1.904 | −0.735 | 4.322 |
| 0.169 | −0.415 | 4.322 | −0.895 | 0.134 | 4.322 | 1.925 | −0.740 | 4.322 |
| 0.075 | −0.385 | 4.322 | −0.840 | 0.113 | 4.322 | 1.941 | −0.744 | 4.322 |
| −0.018 | −0.354 | 4.322 | −0.778 | 0.090 | 4.322 | 1.954 | −0.747 | 4.322 |
| −0.111 | −0.321 | 4.322 | −0.711 | 0.065 | 4.322 | 1.962 | −0.753 | 4.322 |
| −0.204 | −0.287 | 4.322 | −0.641 | 0.039 | 4.322 | 1.966 | −0.760 | 4.322 |
| −0.293 | −0.252 | 4.322 | −0.567 | 0.011 | 4.322 | 1.968 | −0.766 | 4.322 |
| −0.379 | −0.217 | 4.322 | −0.490 | −0.017 | 4.322 | | | |
| −0.461 | −0.182 | 4.322 | −0.411 | −0.046 | 4.322 | | | |
| 1.961 | −0.795 | 4.948 | −0.529 | −0.162 | 4.948 | −0.322 | −0.102 | 4.948 |
| 1.959 | −0.800 | 4.948 | −0.604 | −0.127 | 4.948 | −0.236 | −0.132 | 4.948 |
| 1.956 | −0.805 | 4.948 | −0.675 | −0.093 | 4.948 | −0.147 | −0.163 | 4.948 |
| 1.949 | −0.810 | 4.948 | −0.744 | −0.059 | 4.948 | −0.055 | −0.194 | 4.948 |
| 1.939 | −0.811 | 4.948 | −0.808 | −0.026 | 4.948 | 0.038 | −0.225 | 4.948 |
| 1.926 | −0.809 | 4.948 | −0.867 | 0.005 | 4.948 | 0.131 | −0.255 | 4.948 |
| 1.909 | −0.805 | 4.948 | −0.919 | 0.034 | 4.948 | 0.224 | −0.284 | 4.948 |
| 1.888 | −0.802 | 4.948 | −0.965 | 0.060 | 4.948 | 0.317 | −0.313 | 4.948 |
| 1.863 | −0.797 | 4.948 | −1.008 | 0.085 | 4.948 | 0.410 | −0.342 | 4.948 |
| 1.832 | −0.791 | 4.948 | −1.044 | 0.108 | 4.948 | 0.503 | −0.370 | 4.948 |
| 1.797 | −0.785 | 4.948 | −1.072 | 0.126 | 4.948 | 0.597 | −0.398 | 4.948 |
| 1.755 | −0.777 | 4.948 | −1.093 | 0.142 | 4.948 | 0.690 | −0.426 | 4.948 |
| 1.706 | −0.768 | 4.948 | −1.108 | 0.155 | 4.948 | 0.784 | −0.454 | 4.948 |
| 1.651 | −0.758 | 4.948 | −1.119 | 0.166 | 4.948 | 0.877 | −0.481 | 4.948 |
| 1.590 | −0.747 | 4.948 | −1.123 | 0.172 | 4.948 | 0.971 | −0.509 | 4.948 |

TABLE 12R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.522 | −0.734 | 4.948 | −1.125 | 0.177 | 4.948 | 1.062 | −0.535 | 4.948 |
| 1.448 | −0.720 | 4.948 | −1.125 | 0.180 | 4.948 | 1.149 | −0.559 | 4.948 |
| 1.370 | −0.706 | 4.948 | −1.125 | 0.181 | 4.948 | 1.234 | −0.583 | 4.948 |
| 1.290 | −0.690 | 4.948 | −1.125 | 0.182 | 4.948 | 1.316 | −0.606 | 4.948 |
| 1.206 | −0.674 | 4.948 | −1.124 | 0.182 | 4.948 | 1.394 | −0.627 | 4.948 |
| 1.119 | −0.657 | 4.948 | −1.123 | 0.183 | 4.948 | 1.469 | −0.647 | 4.948 |
| 1.029 | −0.640 | 4.948 | −1.121 | 0.185 | 4.948 | 1.542 | −0.666 | 4.948 |
| 0.935 | −0.621 | 4.948 | −1.116 | 0.186 | 4.948 | 1.608 | −0.684 | 4.948 |
| 0.839 | −0.601 | 4.948 | −1.108 | 0.187 | 4.948 | 1.668 | −0.699 | 4.948 |
| 0.743 | −0.580 | 4.948 | −1.093 | 0.185 | 4.948 | 1.721 | −0.713 | 4.948 |
| 0.647 | −0.558 | 4.948 | −1.074 | 0.180 | 4.948 | 1.768 | −0.725 | 4.948 |
| 0.552 | −0.535 | 4.948 | −1.049 | 0.173 | 4.948 | 1.809 | −0.736 | 4.948 |
| 0.457 | −0.510 | 4.948 | −1.019 | 0.162 | 4.948 | 1.844 | −0.745 | 4.948 |
| 0.362 | −0.485 | 4.948 | −0.979 | 0.147 | 4.948 | 1.874 | −0.752 | 4.948 |
| 0.268 | −0.458 | 4.948 | −0.934 | 0.130 | 4.948 | 1.898 | −0.759 | 4.948 |
| 0.174 | −0.429 | 4.948 | −0.885 | 0.111 | 4.948 | 1.919 | −0.764 | 4.948 |
| 0.081 | −0.399 | 4.948 | −0.831 | 0.090 | 4.948 | 1.935 | −0.768 | 4.948 |
| −0.012 | −0.367 | 4.948 | −0.770 | 0.066 | 4.948 | 1.948 | −0.771 | 4.948 |
| −0.104 | −0.335 | 4.948 | −0.703 | 0.040 | 4.948 | 1.956 | −0.776 | 4.948 |
| −0.196 | −0.300 | 4.948 | −0.634 | 0.013 | 4.948 | 1.960 | −0.783 | 4.948 |
| −0.284 | −0.266 | 4.948 | −0.561 | −0.014 | 4.948 | 1.962 | −0.790 | 4.948 |
| −0.369 | −0.231 | 4.948 | −0.484 | −0.043 | 4.948 | | | |
| −0.451 | −0.196 | 4.948 | −0.405 | −0.072 | 4.948 | | | |
| 1.938 | −0.825 | 5.392 | −0.535 | −0.131 | 5.392 | −0.327 | −0.084 | 5.392 |
| 1.936 | −0.830 | 5.392 | −0.608 | −0.091 | 5.392 | −0.243 | −0.119 | 5.392 |
| 1.932 | −0.835 | 5.392 | −0.677 | −0.052 | 5.392 | −0.156 | −0.154 | 5.392 |
| 1.925 | −0.840 | 5.392 | −0.742 | −0.013 | 5.392 | −0.065 | −0.189 | 5.392 |
| 1.916 | −0.841 | 5.392 | −0.805 | 0.026 | 5.392 | 0.026 | −0.223 | 5.392 |
| 1.903 | −0.838 | 5.392 | −0.861 | 0.061 | 5.392 | 0.118 | −0.257 | 5.392 |
| 1.886 | −0.835 | 5.392 | −0.911 | 0.095 | 5.392 | 0.210 | −0.290 | 5.392 |
| 1.865 | −0.831 | 5.392 | −0.955 | 0.125 | 5.392 | 0.302 | −0.321 | 5.392 |
| 1.839 | −0.827 | 5.392 | −0.996 | 0.154 | 5.392 | 0.394 | −0.352 | 5.392 |
| 1.808 | −0.821 | 5.392 | −1.030 | 0.180 | 5.392 | 0.487 | −0.383 | 5.392 |
| 1.773 | −0.815 | 5.392 | −1.057 | 0.200 | 5.392 | 0.580 | −0.413 | 5.392 |
| 1.730 | −0.807 | 5.392 | −1.077 | 0.218 | 5.392 | 0.672 | −0.443 | 5.392 |
| 1.682 | −0.798 | 5.392 | −1.091 | 0.232 | 5.392 | 0.765 | −0.472 | 5.392 |
| 1.626 | −0.788 | 5.392 | −1.100 | 0.243 | 5.392 | 0.858 | −0.501 | 5.392 |
| 1.565 | −0.777 | 5.392 | −1.105 | 0.250 | 5.392 | 0.952 | −0.529 | 5.392 |
| 1.496 | −0.764 | 5.392 | −1.106 | 0.255 | 5.392 | 1.042 | −0.556 | 5.392 |
| 1.422 | −0.751 | 5.392 | −1.106 | 0.258 | 5.392 | 1.129 | −0.583 | 5.392 |
| 1.344 | −0.736 | 5.392 | −1.106 | 0.259 | 5.392 | 1.213 | −0.607 | 5.392 |
| 1.262 | −0.721 | 5.392 | −1.106 | 0.260 | 5.392 | 1.294 | −0.631 | 5.392 |
| 1.178 | −0.705 | 5.392 | −1.105 | 0.260 | 5.392 | 1.373 | −0.653 | 5.392 |
| 1.090 | −0.688 | 5.392 | −1.104 | 0.261 | 5.392 | 1.448 | −0.674 | 5.392 |
| 1.000 | −0.670 | 5.392 | −1.102 | 0.262 | 5.392 | 1.520 | −0.694 | 5.392 |
| 0.906 | −0.650 | 5.392 | −1.097 | 0.263 | 5.392 | 1.586 | −0.712 | 5.392 |
| 0.810 | −0.629 | 5.392 | −1.089 | 0.262 | 5.392 | 1.645 | −0.728 | 5.392 |
| 0.714 | −0.606 | 5.392 | −1.074 | 0.259 | 5.392 | 1.699 | −0.742 | 5.392 |
| 0.619 | −0.583 | 5.392 | −1.056 | 0.253 | 5.392 | 1.746 | −0.755 | 5.392 |
| 0.524 | −0.557 | 5.392 | −1.032 | 0.243 | 5.392 | 1.787 | −0.766 | 5.392 |
| 0.430 | −0.530 | 5.392 | −1.003 | 0.229 | 5.392 | 1.821 | −0.775 | 5.392 |
| 0.336 | −0.501 | 5.392 | −0.965 | 0.210 | 5.392 | 1.851 | −0.782 | 5.392 |
| 0.243 | −0.470 | 5.392 | −0.921 | 0.189 | 5.392 | 1.876 | −0.789 | 5.392 |
| 0.151 | −0.438 | 5.392 | −0.874 | 0.166 | 5.392 | 1.896 | −0.794 | 5.392 |
| 0.059 | −0.404 | 5.392 | −0.821 | 0.141 | 5.392 | 1.912 | −0.798 | 5.392 |
| −0.032 | −0.368 | 5.392 | −0.763 | 0.112 | 5.392 | 1.925 | −0.801 | 5.392 |
| −0.122 | −0.330 | 5.392 | −0.698 | 0.082 | 5.392 | 1.933 | −0.807 | 5.392 |
| −0.212 | −0.290 | 5.392 | −0.631 | 0.050 | 5.392 | 1.937 | −0.814 | 5.392 |
| −0.298 | −0.251 | 5.392 | −0.560 | 0.017 | 5.392 | 1.938 | −0.820 | 5.392 |
| −0.381 | −0.211 | 5.392 | −0.486 | −0.016 | 5.392 | | | |
| −0.460 | −0.171 | 5.392 | −0.408 | −0.050 | 5.392 | | | |
| 1.917 | −0.854 | 5.712 | −0.542 | −0.092 | 5.712 | −0.334 | −0.060 | 5.712 |
| 1.916 | −0.859 | 5.712 | −0.611 | −0.046 | 5.712 | −0.252 | −0.101 | 5.712 |
| 1.912 | −0.864 | 5.712 | −0.678 | −0.001 | 5.712 | −0.167 | −0.141 | 5.712 |
| 1.905 | −0.869 | 5.712 | −0.740 | 0.044 | 5.712 | −0.079 | −0.182 | 5.712 |
| 1.895 | −0.870 | 5.712 | −0.800 | 0.088 | 5.712 | 0.011 | −0.221 | 5.712 |
| 1.882 | −0.867 | 5.712 | −0.853 | 0.129 | 5.712 | 0.101 | −0.259 | 5.712 |
| 1.865 | −0.864 | 5.712 | −0.900 | 0.166 | 5.712 | 0.192 | −0.295 | 5.712 |
| 1.844 | −0.860 | 5.712 | −0.942 | 0.200 | 5.712 | 0.283 | −0.329 | 5.712 |
| 1.818 | −0.855 | 5.712 | −0.980 | 0.233 | 5.712 | 0.375 | −0.363 | 5.712 |
| 1.787 | −0.850 | 5.712 | −1.013 | 0.261 | 5.712 | 0.468 | −0.395 | 5.712 |
| 1.751 | −0.843 | 5.712 | −1.037 | 0.284 | 5.712 | 0.560 | −0.426 | 5.712 |
| 1.709 | −0.836 | 5.712 | −1.056 | 0.303 | 5.712 | 0.652 | −0.458 | 5.712 |
| 1.659 | −0.827 | 5.712 | −1.070 | 0.319 | 5.712 | 0.745 | −0.489 | 5.712 |
| 1.604 | −0.817 | 5.712 | −1.078 | 0.331 | 5.712 | 0.838 | −0.519 | 5.712 |
| 1.542 | −0.806 | 5.712 | −1.082 | 0.338 | 5.712 | 0.931 | −0.549 | 5.712 |
| 1.473 | −0.794 | 5.712 | −1.084 | 0.343 | 5.712 | 1.021 | −0.578 | 5.712 |

TABLE 12R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.398 | −0.781 | 5.712 | −1.083 | 0.346 | 5.712 | 1.108 | −0.605 | 5.712 |
| 1.319 | −0.767 | 5.712 | −1.083 | 0.347 | 5.712 | 1.192 | −0.631 | 5.712 |
| 1.237 | −0.753 | 5.712 | −1.083 | 0.348 | 5.712 | 1.273 | −0.656 | 5.712 |
| 1.152 | −0.737 | 5.712 | −1.082 | 0.348 | 5.712 | 1.351 | −0.680 | 5.712 |
| 1.065 | −0.721 | 5.712 | −1.081 | 0.349 | 5.712 | 1.426 | −0.702 | 5.712 |
| 0.974 | −0.702 | 5.712 | −1.079 | 0.350 | 5.712 | 1.498 | −0.722 | 5.712 |
| 0.880 | −0.682 | 5.712 | −1.073 | 0.350 | 5.712 | 1.564 | −0.741 | 5.712 |
| 0.784 | −0.659 | 5.712 | −1.065 | 0.348 | 5.712 | 1.624 | −0.757 | 5.712 |
| 0.688 | −0.635 | 5.712 | −1.052 | 0.343 | 5.712 | 1.677 | −0.771 | 5.712 |
| 0.593 | −0.609 | 5.712 | −1.034 | 0.335 | 5.712 | 1.724 | −0.784 | 5.712 |
| 0.499 | −0.582 | 5.712 | −1.011 | 0.323 | 5.712 | 1.765 | −0.795 | 5.712 |
| 0.405 | −0.552 | 5.712 | −0.983 | 0.306 | 5.712 | 1.800 | −0.804 | 5.712 |
| 0.312 | −0.520 | 5.712 | −0.947 | 0.284 | 5.712 | 1.830 | −0.812 | 5.712 |
| 0.220 | −0.486 | 5.712 | −0.905 | 0.259 | 5.712 | 1.854 | −0.818 | 5.712 |
| 0.129 | −0.449 | 5.712 | −0.860 | 0.232 | 5.712 | 1.875 | −0.823 | 5.712 |
| 0.039 | −0.410 | 5.712 | −0.810 | 0.202 | 5.712 | 1.891 | −0.828 | 5.712 |
| −0.050 | −0.369 | 5.712 | −0.754 | 0.169 | 5.712 | 1.904 | −0.831 | 5.712 |
| −0.139 | −0.325 | 5.712 | −0.692 | 0.133 | 5.712 | 1.912 | −0.836 | 5.712 |
| −0.227 | −0.279 | 5.712 | −0.627 | 0.096 | 5.712 | 1.917 | −0.843 | 5.712 |
| −0.311 | −0.233 | 5.712 | −0.558 | 0.058 | 5.712 | 1.918 | −0.849 | 5.712 |
| −0.391 | −0.186 | 5.712 | −0.487 | 0.019 | 5.712 | | | |
| −0.468 | −0.139 | 5.712 | −0.412 | −0.020 | 5.712 | | | |

The coordinate values given in TABLE 13R below provide the nominal profile envelope for an exemplary thirteenth stage rotor.

TABLE 13R

| X-LOC | Y-LOC | Z-LOC | X-LOC | Y-LOC | Z-LOC | X-LOC | Y-LOC | Z-LOC |
|---|---|---|---|---|---|---|---|---|
| 1.944 | −0.057 | 0.000 | −1.060 | −0.103 | 0.000 | −0.780 | 0.115 | 0.000 |
| 1.944 | −0.063 | 0.000 | −1.150 | −0.065 | 0.000 | −0.677 | 0.098 | 0.000 |
| 1.943 | −0.071 | 0.000 | −1.235 | −0.025 | 0.000 | −0.570 | 0.082 | 0.000 |
| 1.940 | −0.080 | 0.000 | −1.315 | 0.016 | 0.000 | −0.459 | 0.067 | 0.000 |
| 1.933 | −0.089 | 0.000 | −1.391 | 0.057 | 0.000 | −0.348 | 0.055 | 0.000 |
| 1.920 | −0.098 | 0.000 | −1.459 | 0.097 | 0.000 | −0.236 | 0.043 | 0.000 |
| 1.901 | −0.103 | 0.000 | −1.518 | 0.134 | 0.000 | −0.125 | 0.034 | 0.000 |
| 1.876 | −0.106 | 0.000 | −1.570 | 0.169 | 0.000 | −0.013 | 0.027 | 0.000 |
| 1.846 | −0.110 | 0.000 | −1.618 | 0.204 | 0.000 | 0.099 | 0.021 | 0.000 |
| 1.809 | −0.115 | 0.000 | −1.658 | 0.235 | 0.000 | 0.211 | 0.016 | 0.000 |
| 1.767 | −0.120 | 0.000 | −1.687 | 0.262 | 0.000 | 0.323 | 0.011 | 0.000 |
| 1.717 | −0.126 | 0.000 | −1.708 | 0.285 | 0.000 | 0.435 | 0.008 | 0.000 |
| 1.659 | −0.134 | 0.000 | −1.722 | 0.304 | 0.000 | 0.547 | 0.005 | 0.000 |
| 1.594 | −0.142 | 0.000 | −1.730 | 0.320 | 0.000 | 0.659 | 0.002 | 0.000 |
| 1.521 | −0.152 | 0.000 | −1.732 | 0.329 | 0.000 | 0.771 | −0.001 | 0.000 |
| 1.440 | −0.162 | 0.000 | −1.731 | 0.335 | 0.000 | 0.880 | −0.003 | 0.000 |
| 1.351 | −0.173 | 0.000 | −1.731 | 0.338 | 0.000 | 0.984 | −0.005 | 0.000 |
| 1.259 | −0.185 | 0.000 | −1.730 | 0.340 | 0.000 | 1.085 | −0.007 | 0.000 |
| 1.163 | −0.197 | 0.000 | −1.730 | 0.340 | 0.000 | 1.182 | −0.009 | 0.000 |
| 1.062 | −0.210 | 0.000 | −1.729 | 0.341 | 0.000 | 1.276 | −0.011 | 0.000 |
| 0.958 | −0.223 | 0.000 | −1.728 | 0.342 | 0.000 | 1.365 | −0.012 | 0.000 |
| 0.851 | −0.236 | 0.000 | −1.726 | 0.345 | 0.000 | 1.451 | −0.013 | 0.000 |
| 0.739 | −0.249 | 0.000 | −1.721 | 0.348 | 0.000 | 1.530 | −0.014 | 0.000 |
| 0.623 | −0.262 | 0.000 | −1.712 | 0.351 | 0.000 | 1.601 | −0.015 | 0.000 |
| 0.507 | −0.273 | 0.000 | −1.695 | 0.353 | 0.000 | 1.664 | −0.015 | 0.000 |
| 0.392 | −0.283 | 0.000 | −1.673 | 0.352 | 0.000 | 1.720 | −0.016 | 0.000 |
| 0.276 | −0.290 | 0.000 | −1.643 | 0.347 | 0.000 | 1.769 | −0.016 | 0.000 |
| 0.160 | −0.296 | 0.000 | −1.607 | 0.339 | 0.000 | 1.810 | −0.017 | 0.000 |
| 0.044 | −0.299 | 0.000 | −1.560 | 0.325 | 0.000 | 1.845 | −0.017 | 0.000 |
| −0.072 | −0.298 | 0.000 | −1.506 | 0.308 | 0.000 | 1.875 | −0.017 | 0.000 |
| −0.188 | −0.293 | 0.000 | −1.449 | 0.290 | 0.000 | 1.899 | −0.017 | 0.000 |
| −0.304 | −0.285 | 0.000 | −1.385 | 0.270 | 0.000 | 1.918 | −0.020 | 0.000 |
| −0.420 | −0.272 | 0.000 | −1.314 | 0.247 | 0.000 | 1.930 | −0.028 | 0.000 |
| −0.535 | −0.255 | 0.000 | −1.235 | 0.224 | 0.000 | 1.938 | −0.036 | 0.000 |
| −0.650 | −0.232 | 0.000 | −1.152 | 0.201 | 0.000 | 1.942 | −0.045 | 0.000 |
| −0.760 | −0.205 | 0.000 | −1.065 | 0.178 | 0.000 | 1.944 | −0.052 | 0.000 |
| −0.865 | −0.174 | 0.000 | −0.974 | 0.156 | 0.000 | | | |
| −0.965 | −0.140 | 0.000 | −0.879 | 0.135 | 0.000 | | | |
| 1.924 | −0.053 | 0.519 | −1.043 | −0.097 | 0.519 | −0.787 | 0.151 | 0.519 |
| 1.924 | −0.058 | 0.519 | −1.136 | −0.067 | 0.519 | −0.684 | 0.138 | 0.519 |
| 1.922 | −0.066 | 0.519 | −1.224 | −0.035 | 0.519 | −0.576 | 0.126 | 0.519 |
| 1.919 | −0.075 | 0.519 | −1.307 | −0.001 | 0.519 | −0.466 | 0.114 | 0.519 |

TABLE 13R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.912 | −0.084 | 0.519 | −1.385 | 0.033 | 0.519 | −0.355 | 0.103 | 0.519 |
| 1.899 | −0.092 | 0.519 | −1.455 | 0.067 | 0.519 | −0.243 | 0.094 | 0.519 |
| 1.880 | −0.096 | 0.519 | −1.518 | 0.099 | 0.519 | −0.132 | 0.086 | 0.519 |
| 1.855 | −0.098 | 0.519 | −1.572 | 0.129 | 0.519 | −0.021 | 0.078 | 0.519 |
| 1.825 | −0.101 | 0.519 | −1.622 | 0.159 | 0.519 | 0.090 | 0.072 | 0.519 |
| 1.790 | −0.104 | 0.519 | −1.665 | 0.187 | 0.519 | 0.202 | 0.066 | 0.519 |
| 1.748 | −0.107 | 0.519 | −1.696 | 0.210 | 0.519 | 0.313 | 0.060 | 0.519 |
| 1.698 | −0.111 | 0.519 | −1.720 | 0.230 | 0.519 | 0.425 | 0.055 | 0.519 |
| 1.641 | −0.116 | 0.519 | −1.736 | 0.247 | 0.519 | 0.536 | 0.049 | 0.519 |
| 1.577 | −0.122 | 0.519 | −1.745 | 0.262 | 0.519 | 0.647 | 0.044 | 0.519 |
| 1.505 | −0.128 | 0.519 | −1.748 | 0.271 | 0.519 | 0.759 | 0.039 | 0.519 |
| 1.425 | −0.134 | 0.519 | −1.749 | 0.277 | 0.519 | 0.867 | 0.033 | 0.519 |
| 1.337 | −0.142 | 0.519 | −1.748 | 0.281 | 0.519 | 0.971 | 0.028 | 0.519 |
| 1.246 | −0.149 | 0.519 | −1.748 | 0.282 | 0.519 | 1.071 | 0.024 | 0.519 |
| 1.151 | −0.158 | 0.519 | −1.748 | 0.283 | 0.519 | 1.167 | 0.019 | 0.519 |
| 1.052 | −0.166 | 0.519 | −1.747 | 0.283 | 0.519 | 1.260 | 0.015 | 0.519 |
| 0.950 | −0.175 | 0.519 | −1.747 | 0.285 | 0.519 | 1.349 | 0.011 | 0.519 |
| 0.843 | −0.184 | 0.519 | −1.745 | 0.287 | 0.519 | 1.435 | 0.007 | 0.519 |
| 0.733 | −0.193 | 0.519 | −1.740 | 0.291 | 0.519 | 1.513 | 0.004 | 0.519 |
| 0.619 | −0.202 | 0.519 | −1.732 | 0.295 | 0.519 | 1.584 | 0.001 | 0.519 |
| 0.505 | −0.210 | 0.519 | −1.715 | 0.299 | 0.519 | 1.647 | −0.002 | 0.519 |
| 0.391 | −0.217 | 0.519 | −1.693 | 0.300 | 0.519 | 1.702 | −0.004 | 0.519 |
| 0.277 | −0.223 | 0.519 | −1.663 | 0.299 | 0.519 | 1.751 | −0.006 | 0.519 |
| 0.163 | −0.228 | 0.519 | −1.626 | 0.295 | 0.519 | 1.792 | −0.008 | 0.519 |
| 0.049 | −0.231 | 0.519 | −1.579 | 0.287 | 0.519 | 1.827 | −0.009 | 0.519 |
| −0.064 | −0.232 | 0.519 | −1.524 | 0.277 | 0.519 | 1.856 | −0.010 | 0.519 |
| −0.178 | −0.230 | 0.519 | −1.465 | 0.266 | 0.519 | 1.880 | −0.011 | 0.519 |
| −0.291 | −0.226 | 0.519 | −1.400 | 0.253 | 0.519 | 1.899 | −0.015 | 0.519 |
| −0.405 | −0.219 | 0.519 | −1.326 | 0.239 | 0.519 | 1.911 | −0.023 | 0.519 |
| −0.518 | −0.208 | 0.519 | −1.246 | 0.224 | 0.519 | 1.918 | −0.032 | 0.519 |
| −0.631 | −0.193 | 0.519 | −1.162 | 0.209 | 0.519 | 1.922 | −0.040 | 0.519 |
| −0.740 | −0.174 | 0.519 | −1.074 | 0.194 | 0.519 | 1.924 | −0.047 | 0.519 |
| −0.845 | −0.152 | 0.519 | −0.982 | 0.179 | 0.519 | | | |
| −0.946 | −0.126 | 0.519 | −0.886 | 0.165 | 0.519 | | | |
| 1.896 | −0.141 | 1.038 | −1.054 | −0.019 | 1.038 | −0.795 | 0.221 | 1.038 |
| 1.895 | −0.147 | 1.038 | −1.144 | 0.012 | 1.038 | −0.692 | 0.204 | 1.038 |
| 1.893 | −0.154 | 1.038 | −1.231 | 0.044 | 1.038 | −0.586 | 0.186 | 1.038 |
| 1.889 | −0.163 | 1.038 | −1.312 | 0.077 | 1.038 | −0.476 | 0.168 | 1.038 |
| 1.881 | −0.171 | 1.038 | −1.390 | 0.111 | 1.038 | −0.366 | 0.151 | 1.038 |
| 1.868 | −0.178 | 1.038 | −1.460 | 0.143 | 1.038 | −0.256 | 0.135 | 1.038 |
| 1.848 | −0.180 | 1.038 | −1.522 | 0.174 | 1.038 | −0.146 | 0.120 | 1.038 |
| 1.823 | −0.181 | 1.038 | −1.576 | 0.203 | 1.038 | −0.035 | 0.106 | 1.038 |
| 1.793 | −0.181 | 1.038 | −1.626 | 0.232 | 1.038 | 0.075 | 0.092 | 1.038 |
| 1.758 | −0.182 | 1.038 | −1.668 | 0.259 | 1.038 | 0.186 | 0.079 | 1.038 |
| 1.716 | −0.183 | 1.038 | −1.699 | 0.281 | 1.038 | 0.296 | 0.066 | 1.038 |
| 1.667 | −0.184 | 1.038 | −1.723 | 0.301 | 1.038 | 0.407 | 0.054 | 1.038 |
| 1.610 | −0.186 | 1.038 | −1.739 | 0.318 | 1.038 | 0.518 | 0.042 | 1.038 |
| 1.545 | −0.187 | 1.038 | −1.749 | 0.332 | 1.038 | 0.628 | 0.030 | 1.038 |
| 1.473 | −0.189 | 1.038 | −1.753 | 0.340 | 1.038 | 0.739 | 0.017 | 1.038 |
| 1.393 | −0.191 | 1.038 | −1.754 | 0.347 | 1.038 | 0.846 | 0.005 | 1.038 |
| 1.306 | −0.192 | 1.038 | −1.753 | 0.350 | 1.038 | 0.949 | −0.006 | 1.038 |
| 1.215 | −0.194 | 1.038 | −1.753 | 0.351 | 1.038 | 1.049 | −0.017 | 1.038 |
| 1.120 | −0.196 | 1.038 | −1.753 | 0.352 | 1.038 | 1.145 | −0.027 | 1.038 |
| 1.021 | −0.199 | 1.038 | −1.752 | 0.353 | 1.038 | 1.237 | −0.037 | 1.038 |
| 0.919 | −0.201 | 1.038 | −1.752 | 0.354 | 1.038 | 1.325 | −0.046 | 1.038 |
| 0.813 | −0.203 | 1.038 | −1.750 | 0.356 | 1.038 | 1.410 | −0.055 | 1.038 |
| 0.702 | −0.204 | 1.038 | −1.745 | 0.360 | 1.038 | 1.488 | −0.063 | 1.038 |
| 0.589 | −0.206 | 1.038 | −1.737 | 0.365 | 1.038 | 1.558 | −0.070 | 1.038 |
| 0.475 | −0.206 | 1.038 | −1.721 | 0.368 | 1.038 | 1.621 | −0.077 | 1.038 |
| 0.361 | −0.206 | 1.038 | −1.698 | 0.370 | 1.038 | 1.676 | −0.082 | 1.038 |
| 0.247 | −0.205 | 1.038 | −1.669 | 0.369 | 1.038 | 1.724 | −0.087 | 1.038 |
| 0.133 | −0.202 | 1.038 | −1.632 | 0.366 | 1.038 | 1.765 | −0.091 | 1.038 |
| 0.020 | −0.198 | 1.038 | −1.584 | 0.360 | 1.038 | 1.799 | −0.094 | 1.038 |
| −0.093 | −0.192 | 1.038 | −1.529 | 0.351 | 1.038 | 1.829 | −0.097 | 1.038 |
| −0.206 | −0.183 | 1.038 | −1.470 | 0.341 | 1.038 | 1.853 | −0.099 | 1.038 |
| −0.318 | −0.172 | 1.038 | −1.405 | 0.329 | 1.038 | 1.871 | −0.103 | 1.038 |
| −0.430 | −0.159 | 1.038 | −1.332 | 0.316 | 1.038 | 1.884 | −0.111 | 1.038 |
| −0.541 | −0.143 | 1.038 | −1.251 | 0.301 | 1.038 | 1.890 | −0.120 | 1.038 |
| −0.652 | −0.123 | 1.038 | −1.167 | 0.286 | 1.038 | 1.894 | −0.129 | 1.038 |
| −0.759 | −0.101 | 1.038 | −1.080 | 0.270 | 1.038 | 1.895 | −0.136 | 1.038 |
| −0.861 | −0.076 | 1.038 | −0.988 | 0.254 | 1.038 | | | |
| −0.960 | −0.048 | 1.038 | −0.893 | 0.238 | 1.038 | | | |
| 1.866 | −0.324 | 1.730 | −1.030 | 0.056 | 1.730 | −0.762 | 0.268 | 1.730 |
| 1.864 | −0.330 | 1.730 | −1.117 | 0.091 | 1.730 | −0.662 | 0.244 | 1.730 |
| 1.861 | −0.337 | 1.730 | −1.199 | 0.125 | 1.730 | −0.559 | 0.219 | 1.730 |
| 1.855 | −0.344 | 1.730 | −1.277 | 0.161 | 1.730 | −0.452 | 0.193 | 1.730 |
| 1.846 | −0.350 | 1.730 | −1.352 | 0.197 | 1.730 | −0.344 | 0.167 | 1.730 |

TABLE 13R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.831 | −0.351 | 1.730 | −1.419 | 0.230 | 1.730 | −0.237 | 0.142 | 1.730 |
| 1.812 | −0.350 | 1.730 | −1.479 | 0.262 | 1.730 | −0.130 | 0.117 | 1.730 |
| 1.787 | −0.349 | 1.730 | −1.532 | 0.292 | 1.730 | −0.022 | 0.093 | 1.730 |
| 1.758 | −0.347 | 1.730 | −1.580 | 0.321 | 1.730 | 0.086 | 0.070 | 1.730 |
| 1.723 | −0.345 | 1.730 | −1.621 | 0.348 | 1.730 | 0.194 | 0.046 | 1.730 |
| 1.682 | −0.342 | 1.730 | −1.652 | 0.370 | 1.730 | 0.301 | 0.023 | 1.730 |
| 1.633 | −0.339 | 1.730 | −1.675 | 0.390 | 1.730 | 0.409 | 0.000 | 1.730 |
| 1.577 | −0.336 | 1.730 | −1.691 | 0.406 | 1.730 | 0.517 | −0.023 | 1.730 |
| 1.513 | −0.332 | 1.730 | −1.701 | 0.419 | 1.730 | 0.625 | −0.045 | 1.730 |
| 1.442 | −0.327 | 1.730 | −1.705 | 0.428 | 1.730 | 0.733 | −0.068 | 1.730 |
| 1.364 | −0.322 | 1.730 | −1.706 | 0.434 | 1.730 | 0.837 | −0.090 | 1.730 |
| 1.278 | −0.316 | 1.730 | −1.705 | 0.437 | 1.730 | 0.938 | −0.111 | 1.730 |
| 1.188 | −0.310 | 1.730 | −1.705 | 0.439 | 1.730 | 1.035 | −0.131 | 1.730 |
| 1.095 | −0.304 | 1.730 | −1.705 | 0.439 | 1.730 | 1.129 | −0.150 | 1.730 |
| 0.997 | −0.297 | 1.730 | −1.704 | 0.440 | 1.730 | 1.219 | −0.168 | 1.730 |
| 0.896 | −0.290 | 1.730 | −1.704 | 0.441 | 1.730 | 1.305 | −0.186 | 1.730 |
| 0.792 | −0.282 | 1.730 | −1.702 | 0.444 | 1.730 | 1.388 | −0.202 | 1.730 |
| 0.683 | −0.274 | 1.730 | −1.697 | 0.447 | 1.730 | 1.464 | −0.217 | 1.730 |
| 0.571 | −0.265 | 1.730 | −1.689 | 0.451 | 1.730 | 1.533 | −0.230 | 1.730 |
| 0.459 | −0.254 | 1.730 | −1.672 | 0.454 | 1.730 | 1.594 | −0.242 | 1.730 |
| 0.348 | −0.243 | 1.730 | −1.650 | 0.455 | 1.730 | 1.648 | −0.253 | 1.730 |
| 0.236 | −0.231 | 1.730 | −1.621 | 0.453 | 1.730 | 1.695 | −0.262 | 1.730 |
| 0.124 | −0.218 | 1.730 | −1.584 | 0.448 | 1.730 | 1.735 | −0.270 | 1.730 |
| 0.013 | −0.203 | 1.730 | −1.537 | 0.441 | 1.730 | 1.768 | −0.276 | 1.730 |
| −0.098 | −0.186 | 1.730 | −1.483 | 0.431 | 1.730 | 1.797 | −0.282 | 1.730 |
| −0.208 | −0.167 | 1.730 | −1.425 | 0.419 | 1.730 | 1.820 | −0.286 | 1.730 |
| −0.318 | −0.146 | 1.730 | −1.361 | 0.405 | 1.730 | 1.839 | −0.290 | 1.730 |
| −0.427 | −0.124 | 1.730 | −1.289 | 0.389 | 1.730 | 1.853 | −0.295 | 1.730 |
| −0.536 | −0.099 | 1.730 | −1.210 | 0.372 | 1.730 | 1.861 | −0.303 | 1.730 |
| −0.643 | −0.071 | 1.730 | −1.128 | 0.353 | 1.730 | 1.864 | −0.311 | 1.730 |
| −0.747 | −0.042 | 1.730 | −1.042 | 0.333 | 1.730 | 1.866 | −0.319 | 1.730 |
| −0.845 | −0.010 | 1.730 | −0.952 | 0.312 | 1.730 | | | |
| −0.940 | 0.022 | 1.730 | −0.859 | 0.291 | 1.730 | | | |
| 1.855 | −0.429 | 2.076 | −0.997 | 0.063 | 2.076 | −0.734 | 0.260 | 2.076 |
| 1.854 | −0.435 | 2.076 | −1.083 | 0.100 | 2.076 | −0.635 | 0.233 | 2.076 |
| 1.850 | −0.441 | 2.076 | −1.165 | 0.137 | 2.076 | −0.533 | 0.205 | 2.076 |
| 1.844 | −0.447 | 2.076 | −1.243 | 0.175 | 2.076 | −0.427 | 0.176 | 2.076 |
| 1.833 | −0.451 | 2.076 | −1.316 | 0.212 | 2.076 | −0.322 | 0.146 | 2.076 |
| 1.818 | −0.450 | 2.076 | −1.383 | 0.247 | 2.076 | −0.216 | 0.117 | 2.076 |
| 1.799 | −0.449 | 2.076 | −1.442 | 0.280 | 2.076 | −0.110 | 0.089 | 2.076 |
| 1.775 | −0.446 | 2.076 | −1.493 | 0.310 | 2.076 | −0.004 | 0.060 | 2.076 |
| 1.746 | −0.443 | 2.076 | −1.541 | 0.340 | 2.076 | 0.101 | 0.032 | 2.076 |
| 1.712 | −0.440 | 2.076 | −1.582 | 0.367 | 2.076 | 0.207 | 0.005 | 2.076 |
| 1.671 | −0.436 | 2.076 | −1.612 | 0.390 | 2.076 | 0.314 | −0.023 | 2.076 |
| 1.623 | −0.431 | 2.076 | −1.635 | 0.409 | 2.076 | 0.420 | −0.050 | 2.076 |
| 1.568 | −0.426 | 2.076 | −1.651 | 0.425 | 2.076 | 0.526 | −0.078 | 2.076 |
| 1.505 | −0.420 | 2.076 | −1.661 | 0.438 | 2.076 | 0.632 | −0.105 | 2.076 |
| 1.435 | −0.413 | 2.076 | −1.665 | 0.447 | 2.076 | 0.738 | −0.132 | 2.076 |
| 1.358 | −0.404 | 2.076 | −1.666 | 0.453 | 2.076 | 0.841 | −0.158 | 2.076 |
| 1.273 | −0.395 | 2.076 | −1.666 | 0.456 | 2.076 | 0.940 | −0.183 | 2.076 |
| 1.185 | −0.386 | 2.076 | −1.665 | 0.457 | 2.076 | 1.035 | −0.207 | 2.076 |
| 1.093 | −0.376 | 2.076 | −1.665 | 0.458 | 2.076 | 1.128 | −0.230 | 2.076 |
| 0.997 | −0.366 | 2.076 | −1.665 | 0.458 | 2.076 | 1.216 | −0.252 | 2.076 |
| 0.898 | −0.355 | 2.076 | −1.664 | 0.460 | 2.076 | 1.301 | −0.273 | 2.076 |
| 0.795 | −0.343 | 2.076 | −1.662 | 0.462 | 2.076 | 1.383 | −0.293 | 2.076 |
| 0.688 | −0.331 | 2.076 | −1.657 | 0.465 | 2.076 | 1.457 | −0.310 | 2.076 |
| 0.578 | −0.317 | 2.076 | −1.648 | 0.468 | 2.076 | 1.525 | −0.327 | 2.076 |
| 0.469 | −0.303 | 2.076 | −1.632 | 0.470 | 2.076 | 1.585 | −0.341 | 2.076 |
| 0.359 | −0.287 | 2.076 | −1.610 | 0.470 | 2.076 | 1.639 | −0.354 | 2.076 |
| 0.250 | −0.271 | 2.076 | −1.581 | 0.467 | 2.076 | 1.685 | −0.365 | 2.076 |
| 0.141 | −0.253 | 2.076 | −1.545 | 0.462 | 2.076 | 1.724 | −0.374 | 2.076 |
| 0.032 | −0.233 | 2.076 | −1.498 | 0.453 | 2.076 | 1.757 | −0.382 | 2.076 |
| −0.077 | −0.212 | 2.076 | −1.445 | 0.441 | 2.076 | 1.785 | −0.388 | 2.076 |
| −0.185 | −0.189 | 2.076 | −1.388 | 0.428 | 2.076 | 1.809 | −0.393 | 2.076 |
| −0.292 | −0.164 | 2.076 | −1.324 | 0.413 | 2.076 | 1.827 | −0.398 | 2.076 |
| −0.400 | −0.137 | 2.076 | −1.253 | 0.395 | 2.076 | 1.841 | −0.402 | 2.076 |
| −0.506 | −0.109 | 2.076 | −1.175 | 0.375 | 2.076 | 1.850 | −0.409 | 2.076 |
| −0.613 | −0.077 | 2.076 | −1.094 | 0.355 | 2.076 | 1.854 | −0.417 | 2.076 |
| −0.715 | −0.044 | 2.076 | −1.009 | 0.333 | 2.076 | 1.856 | −0.424 | 2.076 |
| −0.813 | −0.009 | 2.076 | −0.921 | 0.309 | 2.076 | | | |
| −0.907 | 0.027 | 2.076 | −0.829 | 0.285 | 2.076 | | | |
| 1.831 | −0.586 | 2.768 | −0.959 | 0.045 | 2.768 | −0.697 | 0.203 | 2.768 |
| 1.829 | −0.591 | 2.768 | −1.042 | 0.085 | 2.768 | −0.601 | 0.172 | 2.768 |
| 1.825 | −0.597 | 2.768 | −1.121 | 0.125 | 2.768 | −0.501 | 0.141 | 2.768 |
| 1.818 | −0.602 | 2.768 | −1.196 | 0.164 | 2.768 | −0.398 | 0.108 | 2.768 |
| 1.807 | −0.603 | 2.768 | −1.267 | 0.203 | 2.768 | −0.295 | 0.074 | 2.768 |
| 1.792 | −0.601 | 2.768 | −1.331 | 0.239 | 2.768 | −0.192 | 0.040 | 2.768 |

TABLE 13R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.773 | −0.599 | 2.768 | −1.388 | 0.273 | 2.768 | −0.089 | 0.007 | 2.768 |
| 1.750 | −0.596 | 2.768 | −1.438 | 0.304 | 2.768 | 0.014 | −0.026 | 2.768 |
| 1.721 | −0.592 | 2.768 | −1.484 | 0.334 | 2.768 | 0.117 | −0.058 | 2.768 |
| 1.687 | −0.588 | 2.768 | −1.524 | 0.361 | 2.768 | 0.220 | −0.091 | 2.768 |
| 1.647 | −0.582 | 2.768 | −1.553 | 0.383 | 2.768 | 0.324 | −0.123 | 2.768 |
| 1.600 | −0.576 | 2.768 | −1.576 | 0.402 | 2.768 | 0.427 | −0.155 | 2.768 |
| 1.546 | −0.569 | 2.768 | −1.591 | 0.417 | 2.768 | 0.530 | −0.187 | 2.768 |
| 1.484 | −0.560 | 2.768 | −1.601 | 0.430 | 2.768 | 0.634 | −0.219 | 2.768 |
| 1.416 | −0.551 | 2.768 | −1.605 | 0.439 | 2.768 | 0.737 | −0.251 | 2.768 |
| 1.340 | −0.540 | 2.768 | −1.606 | 0.444 | 2.768 | 0.837 | −0.282 | 2.768 |
| 1.257 | −0.527 | 2.768 | −1.606 | 0.447 | 2.768 | 0.934 | −0.311 | 2.768 |
| 1.170 | −0.514 | 2.768 | −1.606 | 0.449 | 2.768 | 1.027 | −0.339 | 2.768 |
| 1.080 | −0.501 | 2.768 | −1.605 | 0.449 | 2.768 | 1.117 | −0.366 | 2.768 |
| 0.986 | −0.486 | 2.768 | −1.605 | 0.450 | 2.768 | 1.203 | −0.391 | 2.768 |
| 0.888 | −0.471 | 2.768 | −1.604 | 0.451 | 2.768 | 1.286 | −0.415 | 2.768 |
| 0.788 | −0.454 | 2.768 | −1.602 | 0.453 | 2.768 | 1.366 | −0.438 | 2.768 |
| 0.683 | −0.436 | 2.768 | −1.597 | 0.456 | 2.768 | 1.439 | −0.458 | 2.768 |
| 0.576 | −0.417 | 2.768 | −1.588 | 0.458 | 2.768 | 1.505 | −0.477 | 2.768 |
| 0.468 | −0.397 | 2.768 | −1.572 | 0.459 | 2.768 | 1.564 | −0.493 | 2.768 |
| 0.361 | −0.375 | 2.768 | −1.550 | 0.457 | 2.768 | 1.617 | −0.507 | 2.768 |
| 0.254 | −0.353 | 2.768 | −1.522 | 0.452 | 2.768 | 1.662 | −0.520 | 2.768 |
| 0.148 | −0.329 | 2.768 | −1.487 | 0.444 | 2.768 | 1.700 | −0.530 | 2.768 |
| 0.041 | −0.303 | 2.768 | −1.442 | 0.432 | 2.768 | 1.733 | −0.539 | 2.768 |
| −0.064 | −0.276 | 2.768 | −1.389 | 0.417 | 2.768 | 1.760 | −0.546 | 2.768 |
| −0.170 | −0.247 | 2.768 | −1.334 | 0.401 | 2.768 | 1.783 | −0.552 | 2.768 |
| −0.275 | −0.216 | 2.768 | −1.272 | 0.382 | 2.768 | 1.801 | −0.557 | 2.768 |
| −0.379 | −0.184 | 2.768 | −1.203 | 0.361 | 2.768 | 1.815 | −0.560 | 2.768 |
| −0.483 | −0.149 | 2.768 | −1.127 | 0.337 | 2.768 | 1.825 | −0.566 | 2.768 |
| −0.587 | −0.112 | 2.768 | −1.048 | 0.313 | 2.768 | 1.830 | −0.573 | 2.768 |
| −0.686 | −0.073 | 2.768 | −0.965 | 0.287 | 2.768 | 1.831 | −0.580 | 2.768 |
| −0.782 | −0.034 | 2.768 | −0.879 | 0.260 | 2.768 | | | |
| −0.873 | 0.005 | 2.768 | −0.790 | 0.232 | 2.768 | | | |
| 1.819 | −0.662 | 3.460 | −0.929 | −0.009 | 3.460 | −0.681 | 0.109 | 3.460 |
| 1.818 | −0.667 | 3.460 | −1.010 | 0.030 | 3.460 | −0.586 | 0.077 | 3.460 |
| 1.813 | −0.673 | 3.460 | −1.088 | 0.069 | 3.460 | −0.488 | 0.045 | 3.460 |
| 1.806 | −0.678 | 3.460 | −1.162 | 0.107 | 3.460 | −0.387 | 0.011 | 3.460 |
| 1.795 | −0.679 | 3.460 | −1.232 | 0.145 | 3.460 | −0.285 | −0.023 | 3.460 |
| 1.781 | −0.677 | 3.460 | −1.296 | 0.180 | 3.460 | −0.184 | −0.056 | 3.460 |
| 1.762 | −0.675 | 3.460 | −1.352 | 0.212 | 3.460 | −0.082 | −0.090 | 3.460 |
| 1.739 | −0.672 | 3.460 | −1.402 | 0.242 | 3.460 | 0.020 | −0.122 | 3.460 |
| 1.711 | −0.668 | 3.460 | −1.448 | 0.271 | 3.460 | 0.121 | −0.155 | 3.460 |
| 1.677 | −0.664 | 3.460 | −1.488 | 0.296 | 3.460 | 0.223 | −0.187 | 3.460 |
| 1.638 | −0.658 | 3.460 | −1.518 | 0.316 | 3.460 | 0.325 | −0.219 | 3.460 |
| 1.591 | −0.652 | 3.460 | −1.540 | 0.334 | 3.460 | 0.427 | −0.251 | 3.460 |
| 1.538 | −0.645 | 3.460 | −1.556 | 0.349 | 3.460 | 0.530 | −0.282 | 3.460 |
| 1.477 | −0.637 | 3.460 | −1.567 | 0.361 | 3.460 | 0.632 | −0.314 | 3.460 |
| 1.409 | −0.627 | 3.460 | −1.571 | 0.369 | 3.460 | 0.734 | −0.345 | 3.460 |
| 1.334 | −0.616 | 3.460 | −1.572 | 0.375 | 3.460 | 0.833 | −0.374 | 3.460 |
| 1.252 | −0.603 | 3.460 | −1.572 | 0.378 | 3.460 | 0.929 | −0.403 | 3.460 |
| 1.166 | −0.590 | 3.460 | −1.572 | 0.379 | 3.460 | 1.021 | −0.430 | 3.460 |
| 1.077 | −0.575 | 3.460 | −1.572 | 0.380 | 3.460 | 1.110 | −0.456 | 3.460 |
| 0.985 | −0.560 | 3.460 | −1.571 | 0.381 | 3.460 | 1.196 | −0.480 | 3.460 |
| 0.889 | −0.544 | 3.460 | −1.570 | 0.382 | 3.460 | 1.278 | −0.503 | 3.460 |
| 0.790 | −0.526 | 3.460 | −1.568 | 0.384 | 3.460 | 1.357 | −0.524 | 3.460 |
| 0.687 | −0.507 | 3.460 | −1.563 | 0.386 | 3.460 | 1.430 | −0.543 | 3.460 |
| 0.581 | −0.486 | 3.460 | −1.554 | 0.388 | 3.460 | 1.495 | −0.561 | 3.460 |
| 0.476 | −0.464 | 3.460 | −1.538 | 0.387 | 3.460 | 1.554 | −0.576 | 3.460 |
| 0.370 | −0.441 | 3.460 | −1.517 | 0.384 | 3.460 | 1.606 | −0.589 | 3.460 |
| 0.265 | −0.417 | 3.460 | −1.489 | 0.378 | 3.460 | 1.651 | −0.600 | 3.460 |
| 0.160 | −0.392 | 3.460 | −1.455 | 0.368 | 3.460 | 1.689 | −0.610 | 3.460 |
| 0.055 | −0.365 | 3.460 | −1.411 | 0.354 | 3.460 | 1.721 | −0.618 | 3.460 |
| −0.049 | −0.336 | 3.460 | −1.360 | 0.337 | 3.460 | 1.748 | −0.624 | 3.460 |
| −0.152 | −0.306 | 3.460 | −1.306 | 0.320 | 3.460 | 1.771 | −0.630 | 3.460 |
| −0.256 | −0.274 | 3.460 | −1.245 | 0.299 | 3.460 | 1.789 | −0.634 | 3.460 |
| −0.359 | −0.240 | 3.460 | −1.177 | 0.276 | 3.460 | 1.803 | −0.637 | 3.460 |
| −0.461 | −0.205 | 3.460 | −1.103 | 0.251 | 3.460 | 1.812 | −0.642 | 3.460 |
| −0.563 | −0.166 | 3.460 | −1.026 | 0.224 | 3.460 | 1.818 | −0.649 | 3.460 |
| −0.660 | −0.128 | 3.460 | −0.945 | 0.197 | 3.460 | 1.820 | −0.656 | 3.460 |
| −0.754 | −0.088 | 3.460 | −0.860 | 0.169 | 3.460 | | | |
| −0.843 | −0.049 | 3.460 | −0.772 | 0.139 | 3.460 | | | |
| 1.791 | −0.658 | 4.152 | −0.926 | −0.043 | 4.152 | −0.697 | 0.036 | 4.152 |
| 1.789 | −0.663 | 4.152 | −1.007 | −0.007 | 4.152 | −0.603 | 0.006 | 4.152 |
| 1.785 | −0.669 | 4.152 | −1.085 | 0.029 | 4.152 | −0.506 | −0.025 | 4.152 |
| 1.778 | −0.674 | 4.152 | −1.159 | 0.064 | 4.152 | −0.405 | −0.057 | 4.152 |
| 1.767 | −0.675 | 4.152 | −1.229 | 0.099 | 4.152 | −0.304 | −0.088 | 4.152 |
| 1.753 | −0.673 | 4.152 | −1.293 | 0.131 | 4.152 | −0.204 | −0.120 | 4.152 |
| 1.735 | −0.671 | 4.152 | −1.349 | 0.161 | 4.152 | −0.103 | −0.150 | 4.152 |

TABLE 13R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.712 | −0.668 | 4.152 | −1.399 | 0.188 | 4.152 | −0.001 | −0.180 | 4.152 |
| 1.684 | −0.665 | 4.152 | −1.446 | 0.214 | 4.152 | 0.100 | −0.210 | 4.152 |
| 1.651 | −0.661 | 4.152 | −1.486 | 0.237 | 4.152 | 0.201 | −0.240 | 4.152 |
| 1.612 | −0.656 | 4.152 | −1.516 | 0.256 | 4.152 | 0.303 | −0.268 | 4.152 |
| 1.566 | −0.650 | 4.152 | −1.540 | 0.272 | 4.152 | 0.404 | −0.297 | 4.152 |
| 1.513 | −0.643 | 4.152 | −1.556 | 0.286 | 4.152 | 0.506 | −0.325 | 4.152 |
| 1.453 | −0.635 | 4.152 | −1.567 | 0.297 | 4.152 | 0.608 | −0.353 | 4.152 |
| 1.387 | −0.626 | 4.152 | −1.572 | 0.305 | 4.152 | 0.710 | −0.380 | 4.152 |
| 1.313 | −0.615 | 4.152 | −1.574 | 0.310 | 4.152 | 0.809 | −0.407 | 4.152 |
| 1.232 | −0.604 | 4.152 | −1.574 | 0.313 | 4.152 | 0.904 | −0.431 | 4.152 |
| 1.147 | −0.591 | 4.152 | −1.574 | 0.314 | 4.152 | 0.996 | −0.455 | 4.152 |
| 1.060 | −0.577 | 4.152 | −1.573 | 0.315 | 4.152 | 1.085 | −0.478 | 4.152 |
| 0.968 | −0.563 | 4.152 | −1.573 | 0.316 | 4.152 | 1.170 | −0.499 | 4.152 |
| 0.874 | −0.547 | 4.152 | −1.572 | 0.317 | 4.152 | 1.252 | −0.519 | 4.152 |
| 0.776 | −0.530 | 4.152 | −1.570 | 0.319 | 4.152 | 1.331 | −0.537 | 4.152 |
| 0.674 | −0.511 | 4.152 | −1.565 | 0.321 | 4.152 | 1.403 | −0.554 | 4.152 |
| 0.570 | −0.492 | 4.152 | −1.556 | 0.322 | 4.152 | 1.468 | −0.569 | 4.152 |
| 0.465 | −0.471 | 4.152 | −1.540 | 0.321 | 4.152 | 1.527 | −0.582 | 4.152 |
| 0.361 | −0.449 | 4.152 | −1.519 | 0.317 | 4.152 | 1.578 | −0.593 | 4.152 |
| 0.257 | −0.426 | 4.152 | −1.492 | 0.309 | 4.152 | 1.623 | −0.603 | 4.152 |
| 0.154 | −0.401 | 4.152 | −1.459 | 0.299 | 4.152 | 1.661 | −0.611 | 4.152 |
| 0.050 | −0.375 | 4.152 | −1.415 | 0.284 | 4.152 | 1.693 | −0.618 | 4.152 |
| −0.053 | −0.348 | 4.152 | −1.366 | 0.266 | 4.152 | 1.720 | −0.623 | 4.152 |
| −0.156 | −0.320 | 4.152 | −1.313 | 0.247 | 4.152 | 1.743 | −0.628 | 4.152 |
| −0.258 | −0.290 | 4.152 | −1.253 | 0.226 | 4.152 | 1.761 | −0.632 | 4.152 |
| −0.360 | −0.258 | 4.152 | −1.186 | 0.203 | 4.152 | 1.775 | −0.634 | 4.152 |
| −0.462 | −0.224 | 4.152 | −1.113 | 0.177 | 4.152 | 1.784 | −0.639 | 4.152 |
| −0.562 | −0.189 | 4.152 | −1.037 | 0.151 | 4.152 | 1.789 | −0.646 | 4.152 |
| −0.659 | −0.153 | 4.152 | −0.957 | 0.123 | 4.152 | 1.791 | −0.653 | 4.152 |
| −0.752 | −0.116 | 4.152 | −0.874 | 0.095 | 4.152 | | | |
| −0.841 | −0.080 | 4.152 | −0.787 | 0.066 | 4.152 | | | |
| 1.762 | −0.641 | 4.498 | −0.938 | −0.035 | 4.498 | −0.715 | 0.031 | 4.498 |
| 1.760 | −0.646 | 4.498 | −1.019 | 0.000 | 4.498 | −0.621 | 0.002 | 4.498 |
| 1.756 | −0.652 | 4.498 | −1.096 | 0.035 | 4.498 | −0.525 | −0.028 | 4.498 |
| 1.748 | −0.657 | 4.498 | −1.170 | 0.069 | 4.498 | −0.424 | −0.059 | 4.498 |
| 1.738 | −0.657 | 4.498 | −1.240 | 0.103 | 4.498 | −0.324 | −0.089 | 4.498 |
| 1.724 | −0.656 | 4.498 | −1.303 | 0.134 | 4.498 | −0.223 | −0.119 | 4.498 |
| 1.706 | −0.653 | 4.498 | −1.360 | 0.163 | 4.498 | −0.123 | −0.149 | 4.498 |
| 1.683 | −0.650 | 4.498 | −1.410 | 0.190 | 4.498 | −0.022 | −0.178 | 4.498 |
| 1.655 | −0.647 | 4.498 | −1.457 | 0.215 | 4.498 | 0.079 | −0.206 | 4.498 |
| 1.623 | −0.642 | 4.498 | −1.497 | 0.238 | 4.498 | 0.180 | −0.234 | 4.498 |
| 1.584 | −0.637 | 4.498 | −1.527 | 0.256 | 4.498 | 0.281 | −0.262 | 4.498 |
| 1.539 | −0.631 | 4.498 | −1.550 | 0.271 | 4.498 | 0.382 | −0.290 | 4.498 |
| 1.486 | −0.623 | 4.498 | −1.567 | 0.285 | 4.498 | 0.484 | −0.317 | 4.498 |
| 1.427 | −0.615 | 4.498 | −1.578 | 0.296 | 4.498 | 0.585 | −0.344 | 4.498 |
| 1.360 | −0.606 | 4.498 | −1.583 | 0.303 | 4.498 | 0.687 | −0.370 | 4.498 |
| 1.287 | −0.595 | 4.498 | −1.585 | 0.308 | 4.498 | 0.785 | −0.395 | 4.498 |
| 1.207 | −0.583 | 4.498 | −1.585 | 0.311 | 4.498 | 0.880 | −0.419 | 4.498 |
| 1.123 | −0.570 | 4.498 | −1.585 | 0.313 | 4.498 | 0.971 | −0.442 | 4.498 |
| 1.036 | −0.556 | 4.498 | −1.585 | 0.313 | 4.498 | 1.060 | −0.464 | 4.498 |
| 0.946 | −0.541 | 4.498 | −1.584 | 0.314 | 4.498 | 1.145 | −0.484 | 4.498 |
| 0.852 | −0.525 | 4.498 | −1.583 | 0.315 | 4.498 | 1.226 | −0.503 | 4.498 |
| 0.754 | −0.508 | 4.498 | −1.581 | 0.317 | 4.498 | 1.305 | −0.522 | 4.498 |
| 0.654 | −0.490 | 4.498 | −1.576 | 0.319 | 4.498 | 1.376 | −0.538 | 4.498 |
| 0.550 | −0.470 | 4.498 | −1.567 | 0.319 | 4.498 | 1.441 | −0.552 | 4.498 |
| 0.446 | −0.449 | 4.498 | −1.551 | 0.318 | 4.498 | 1.499 | −0.565 | 4.498 |
| 0.343 | −0.427 | 4.498 | −1.531 | 0.314 | 4.498 | 1.550 | −0.576 | 4.498 |
| 0.240 | −0.404 | 4.498 | −1.504 | 0.306 | 4.498 | 1.595 | −0.586 | 4.498 |
| 0.137 | −0.380 | 4.498 | −1.471 | 0.294 | 4.498 | 1.632 | −0.594 | 4.498 |
| 0.034 | −0.355 | 4.498 | −1.428 | 0.279 | 4.498 | 1.665 | −0.601 | 4.498 |
| −0.069 | −0.329 | 4.498 | −1.379 | 0.261 | 4.498 | 1.692 | −0.606 | 4.498 |
| −0.171 | −0.301 | 4.498 | −1.326 | 0.242 | 4.498 | 1.714 | −0.611 | 4.498 |
| −0.273 | −0.272 | 4.498 | −1.267 | 0.221 | 4.498 | 1.732 | −0.615 | 4.498 |
| −0.375 | −0.242 | 4.498 | −1.201 | 0.197 | 4.498 | 1.745 | −0.617 | 4.498 |
| −0.475 | −0.209 | 4.498 | −1.129 | 0.171 | 4.498 | 1.755 | −0.622 | 4.498 |
| −0.576 | −0.175 | 4.498 | −1.053 | 0.145 | 4.498 | 1.760 | −0.629 | 4.498 |
| −0.672 | −0.141 | 4.498 | −0.973 | 0.117 | 4.498 | 1.762 | −0.636 | 4.498 |
| −0.765 | −0.105 | 4.498 | −0.891 | 0.089 | 4.498 | | | |
| −0.853 | −0.070 | 4.498 | −0.804 | 0.061 | 4.498 | | | |
| 1.700 | −0.624 | 5.017 | −0.966 | 0.017 | 5.017 | −0.746 | 0.068 | 5.017 |
| 1.698 | −0.629 | 5.017 | −1.045 | 0.053 | 5.017 | −0.653 | 0.038 | 5.017 |
| 1.694 | −0.634 | 5.017 | −1.121 | 0.088 | 5.017 | −0.558 | 0.008 | 5.017 |
| 1.687 | −0.639 | 5.017 | −1.194 | 0.123 | 5.017 | −0.459 | −0.023 | 5.017 |
| 1.676 | −0.640 | 5.017 | −1.263 | 0.158 | 5.017 | −0.359 | −0.054 | 5.017 |
| 1.662 | −0.637 | 5.017 | −1.324 | 0.191 | 5.017 | −0.260 | −0.083 | 5.017 |
| 1.644 | −0.634 | 5.017 | −1.380 | 0.221 | 5.017 | −0.160 | −0.113 | 5.017 |
| 1.622 | −0.631 | 5.017 | −1.429 | 0.248 | 5.017 | −0.060 | −0.142 | 5.017 |

TABLE 13R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.595 | −0.626 | 5.017 | −1.474 | 0.274 | 5.017 | 0.039 | −0.171 | 5.017 |
| 1.562 | −0.621 | 5.017 | −1.513 | 0.298 | 5.017 | 0.139 | −0.199 | 5.017 |
| 1.525 | −0.614 | 5.017 | −1.543 | 0.316 | 5.017 | 0.239 | −0.227 | 5.017 |
| 1.480 | −0.607 | 5.017 | −1.565 | 0.333 | 5.017 | 0.340 | −0.254 | 5.017 |
| 1.428 | −0.598 | 5.017 | −1.581 | 0.346 | 5.017 | 0.440 | −0.282 | 5.017 |
| 1.369 | −0.588 | 5.017 | −1.592 | 0.357 | 5.017 | 0.540 | −0.309 | 5.017 |
| 1.304 | −0.577 | 5.017 | −1.597 | 0.365 | 5.017 | 0.640 | −0.336 | 5.017 |
| 1.232 | −0.564 | 5.017 | −1.599 | 0.370 | 5.017 | 0.737 | −0.362 | 5.017 |
| 1.153 | −0.550 | 5.017 | −1.599 | 0.373 | 5.017 | 0.831 | −0.387 | 5.017 |
| 1.070 | −0.535 | 5.017 | −1.599 | 0.374 | 5.017 | 0.921 | −0.411 | 5.017 |
| 0.984 | −0.520 | 5.017 | −1.598 | 0.375 | 5.017 | 1.009 | −0.433 | 5.017 |
| 0.895 | −0.504 | 5.017 | −1.598 | 0.375 | 5.017 | 1.092 | −0.455 | 5.017 |
| 0.802 | −0.486 | 5.017 | −1.597 | 0.376 | 5.017 | 1.173 | −0.476 | 5.017 |
| 0.706 | −0.467 | 5.017 | −1.595 | 0.378 | 5.017 | 1.250 | −0.495 | 5.017 |
| 0.607 | −0.448 | 5.017 | −1.589 | 0.379 | 5.017 | 1.321 | −0.513 | 5.017 |
| 0.504 | −0.426 | 5.017 | −1.581 | 0.380 | 5.017 | 1.385 | −0.528 | 5.017 |
| 0.402 | −0.404 | 5.017 | −1.565 | 0.377 | 5.017 | 1.442 | −0.542 | 5.017 |
| 0.300 | −0.381 | 5.017 | −1.545 | 0.372 | 5.017 | 1.492 | −0.554 | 5.017 |
| 0.197 | −0.358 | 5.017 | −1.519 | 0.363 | 5.017 | 1.536 | −0.565 | 5.017 |
| 0.096 | −0.333 | 5.017 | −1.487 | 0.350 | 5.017 | 1.573 | −0.574 | 5.017 |
| −0.006 | −0.307 | 5.017 | −1.445 | 0.332 | 5.017 | 1.605 | −0.581 | 5.017 |
| −0.107 | −0.281 | 5.017 | −1.397 | 0.313 | 5.017 | 1.632 | −0.587 | 5.017 |
| −0.209 | −0.253 | 5.017 | −1.346 | 0.291 | 5.017 | 1.653 | −0.593 | 5.017 |
| −0.309 | −0.223 | 5.017 | −1.288 | 0.268 | 5.017 | 1.671 | −0.597 | 5.017 |
| −0.409 | −0.192 | 5.017 | −1.224 | 0.242 | 5.017 | 1.684 | −0.600 | 5.017 |
| −0.509 | −0.160 | 5.017 | −1.153 | 0.214 | 5.017 | 1.694 | −0.604 | 5.017 |
| −0.608 | −0.125 | 5.017 | −1.078 | 0.186 | 5.017 | 1.699 | −0.612 | 5.017 |
| −0.703 | −0.090 | 5.017 | −1.000 | 0.157 | 5.017 | 1.700 | −0.618 | 5.017 |
| −0.795 | −0.055 | 5.017 | −0.919 | 0.128 | 5.017 | | | |
| −0.882 | −0.019 | 5.017 | −0.834 | 0.098 | 5.017 | | | |
| 1.611 | −0.619 | 5.536 | −1.016 | 0.133 | 5.536 | −0.801 | 0.150 | 5.536 |
| 1.609 | −0.624 | 5.536 | −1.092 | 0.178 | 5.536 | −0.713 | 0.112 | 5.536 |
| 1.605 | −0.629 | 5.536 | −1.163 | 0.222 | 5.536 | −0.620 | 0.073 | 5.536 |
| 1.598 | −0.634 | 5.536 | −1.231 | 0.265 | 5.536 | −0.524 | 0.035 | 5.536 |
| 1.587 | −0.634 | 5.536 | −1.295 | 0.307 | 5.536 | −0.427 | −0.002 | 5.536 |
| 1.573 | −0.632 | 5.536 | −1.353 | 0.347 | 5.536 | −0.330 | −0.038 | 5.536 |
| 1.556 | −0.629 | 5.536 | −1.405 | 0.384 | 5.536 | −0.232 | −0.072 | 5.536 |
| 1.533 | −0.625 | 5.536 | −1.450 | 0.417 | 5.536 | −0.134 | −0.106 | 5.536 |
| 1.506 | −0.621 | 5.536 | −1.492 | 0.448 | 5.536 | −0.036 | −0.138 | 5.536 |
| 1.474 | −0.615 | 5.536 | −1.528 | 0.476 | 5.536 | 0.063 | −0.170 | 5.536 |
| 1.436 | −0.609 | 5.536 | −1.555 | 0.498 | 5.536 | 0.161 | −0.200 | 5.536 |
| 1.391 | −0.601 | 5.536 | −1.576 | 0.517 | 5.536 | 0.260 | −0.230 | 5.536 |
| 1.339 | −0.592 | 5.536 | −1.590 | 0.532 | 5.536 | 0.360 | −0.260 | 5.536 |
| 1.281 | −0.581 | 5.536 | −1.600 | 0.545 | 5.536 | 0.459 | −0.289 | 5.536 |
| 1.215 | −0.569 | 5.536 | −1.604 | 0.552 | 5.536 | 0.559 | −0.318 | 5.536 |
| 1.143 | −0.556 | 5.536 | −1.606 | 0.558 | 5.536 | 0.655 | −0.345 | 5.536 |
| 1.064 | −0.542 | 5.536 | −1.606 | 0.561 | 5.536 | 0.748 | −0.372 | 5.536 |
| 0.982 | −0.527 | 5.536 | −1.605 | 0.562 | 5.536 | 0.838 | −0.397 | 5.536 |
| 0.896 | −0.510 | 5.536 | −1.605 | 0.562 | 5.536 | 0.924 | −0.421 | 5.536 |
| 0.807 | −0.492 | 5.536 | −1.604 | 0.563 | 5.536 | 1.007 | −0.444 | 5.536 |
| 0.715 | −0.474 | 5.536 | −1.603 | 0.564 | 5.536 | 1.087 | −0.466 | 5.536 |
| 0.619 | −0.453 | 5.536 | −1.601 | 0.565 | 5.536 | 1.164 | −0.486 | 5.536 |
| 0.520 | −0.432 | 5.536 | −1.595 | 0.565 | 5.536 | 1.234 | −0.504 | 5.536 |
| 0.418 | −0.408 | 5.536 | −1.587 | 0.564 | 5.536 | 1.298 | −0.520 | 5.536 |
| 0.316 | −0.384 | 5.536 | −1.572 | 0.559 | 5.536 | 1.355 | −0.535 | 5.536 |
| 0.215 | −0.358 | 5.536 | −1.553 | 0.550 | 5.536 | 1.405 | −0.547 | 5.536 |
| 0.114 | −0.331 | 5.536 | −1.529 | 0.537 | 5.536 | 1.448 | −0.558 | 5.536 |
| 0.013 | −0.302 | 5.536 | −1.499 | 0.519 | 5.536 | 1.485 | −0.568 | 5.536 |
| −0.087 | −0.271 | 5.536 | −1.461 | 0.496 | 5.536 | 1.517 | −0.575 | 5.536 |
| −0.187 | −0.239 | 5.536 | −1.416 | 0.469 | 5.536 | 1.543 | −0.582 | 5.536 |
| −0.287 | −0.205 | 5.536 | −1.369 | 0.441 | 5.536 | 1.565 | −0.587 | 5.536 |
| −0.385 | −0.169 | 5.536 | −1.315 | 0.410 | 5.536 | 1.583 | −0.591 | 5.536 |
| −0.483 | −0.130 | 5.536 | −1.254 | 0.376 | 5.536 | 1.596 | −0.595 | 5.536 |
| −0.579 | −0.089 | 5.536 | −1.188 | 0.340 | 5.536 | 1.605 | −0.600 | 5.536 |
| −0.675 | −0.045 | 5.536 | −1.118 | 0.303 | 5.536 | 1.610 | −0.607 | 5.536 |
| −0.766 | −0.001 | 5.536 | −1.044 | 0.265 | 5.536 | 1.612 | −0.613 | 5.536 |
| −0.853 | 0.044 | 5.536 | −0.967 | 0.227 | 5.536 | | | |
| −0.937 | 0.088 | 5.536 | −0.886 | 0.189 | 5.536 | | | |

The coordinate values given in TABLE 14R below provide the nominal profile envelope for an exemplary fourteenth stage rotor.

TABLE 14R

| X-LOC | Y-LOC | Z-LOC | X-LOC | Y-LOC | Z-LOC | X-LOC | Y-LOC | Z-LOC |
|---|---|---|---|---|---|---|---|---|
| 1.976 | −0.038 | 0.000 | −1.047 | −0.124 | 0.000 | −0.779 | 0.101 | 0.000 |
| 1.976 | −0.044 | 0.000 | −1.140 | −0.090 | 0.000 | −0.674 | 0.088 | 0.000 |
| 1.974 | −0.051 | 0.000 | −1.227 | −0.055 | 0.000 | −0.565 | 0.077 | 0.000 |
| 1.970 | −0.060 | 0.000 | −1.310 | −0.019 | 0.000 | −0.453 | 0.068 | 0.000 |
| 1.963 | −0.069 | 0.000 | −1.389 | 0.018 | 0.000 | −0.340 | 0.060 | 0.000 |
| 1.949 | −0.076 | 0.000 | −1.459 | 0.055 | 0.000 | −0.227 | 0.055 | 0.000 |
| 1.929 | −0.079 | 0.000 | −1.521 | 0.089 | 0.000 | −0.114 | 0.050 | 0.000 |
| 1.904 | −0.083 | 0.000 | −1.575 | 0.122 | 0.000 | −0.001 | 0.046 | 0.000 |
| 1.874 | −0.087 | 0.000 | −1.624 | 0.154 | 0.000 | 0.112 | 0.043 | 0.000 |
| 1.837 | −0.092 | 0.000 | −1.665 | 0.185 | 0.000 | 0.225 | 0.040 | 0.000 |
| 1.795 | −0.098 | 0.000 | −1.695 | 0.211 | 0.000 | 0.338 | 0.037 | 0.000 |
| 1.745 | −0.105 | 0.000 | −1.718 | 0.233 | 0.000 | 0.451 | 0.034 | 0.000 |
| 1.687 | −0.113 | 0.000 | −1.733 | 0.251 | 0.000 | 0.564 | 0.031 | 0.000 |
| 1.621 | −0.122 | 0.000 | −1.741 | 0.267 | 0.000 | 0.677 | 0.028 | 0.000 |
| 1.548 | −0.132 | 0.000 | −1.744 | 0.276 | 0.000 | 0.790 | 0.024 | 0.000 |
| 1.467 | −0.143 | 0.000 | −1.745 | 0.282 | 0.000 | 0.899 | 0.021 | 0.000 |
| 1.378 | −0.155 | 0.000 | −1.744 | 0.285 | 0.000 | 1.005 | 0.018 | 0.000 |
| 1.286 | −0.168 | 0.000 | −1.743 | 0.287 | 0.000 | 1.106 | 0.015 | 0.000 |
| 1.189 | −0.181 | 0.000 | −1.743 | 0.288 | 0.000 | 1.204 | 0.012 | 0.000 |
| 1.089 | −0.195 | 0.000 | −1.743 | 0.288 | 0.000 | 1.299 | 0.009 | 0.000 |
| 0.985 | −0.209 | 0.000 | −1.742 | 0.289 | 0.000 | 1.389 | 0.007 | 0.000 |
| 0.877 | −0.223 | 0.000 | −1.740 | 0.292 | 0.000 | 1.476 | 0.005 | 0.000 |
| 0.765 | −0.236 | 0.000 | −1.735 | 0.295 | 0.000 | 1.555 | 0.003 | 0.000 |
| 0.649 | −0.249 | 0.000 | −1.726 | 0.298 | 0.000 | 1.626 | 0.002 | 0.000 |
| 0.533 | −0.261 | 0.000 | −1.709 | 0.300 | 0.000 | 1.690 | 0.001 | 0.000 |
| 0.417 | −0.271 | 0.000 | −1.686 | 0.299 | 0.000 | 1.747 | 0.000 | 0.000 |
| 0.301 | −0.279 | 0.000 | −1.656 | 0.295 | 0.000 | 1.796 | −0.001 | 0.000 |
| 0.185 | −0.286 | 0.000 | −1.619 | 0.288 | 0.000 | 1.837 | −0.001 | 0.000 |
| 0.069 | −0.289 | 0.000 | −1.571 | 0.277 | 0.000 | 1.873 | −0.002 | 0.000 |
| −0.047 | −0.289 | 0.000 | −1.517 | 0.262 | 0.000 | 1.903 | −0.002 | 0.000 |
| −0.163 | −0.286 | 0.000 | −1.459 | 0.246 | 0.000 | 1.927 | −0.002 | 0.000 |
| −0.280 | −0.280 | 0.000 | −1.393 | 0.228 | 0.000 | 1.946 | −0.003 | 0.000 |
| −0.396 | −0.269 | 0.000 | −1.320 | 0.208 | 0.000 | 1.960 | −0.009 | 0.000 |
| −0.512 | −0.254 | 0.000 | −1.240 | 0.188 | 0.000 | 1.968 | −0.017 | 0.000 |
| −0.628 | −0.234 | 0.000 | −1.156 | 0.169 | 0.000 | 1.973 | −0.025 | 0.000 |
| −0.740 | −0.211 | 0.000 | −1.068 | 0.150 | 0.000 | 1.975 | −0.032 | 0.000 |
| −0.847 | −0.184 | 0.000 | −0.975 | 0.132 | 0.000 | | | |
| −0.949 | −0.155 | 0.000 | −0.879 | 0.116 | 0.000 | | | |
| 1.920 | −0.108 | 0.691 | −1.055 | −0.048 | 0.691 | −0.800 | 0.152 | 0.691 |
| 1.920 | −0.114 | 0.691 | −1.145 | −0.018 | 0.691 | −0.696 | 0.136 | 0.691 |
| 1.918 | −0.121 | 0.691 | −1.231 | 0.012 | 0.691 | −0.589 | 0.121 | 0.691 |
| 1.913 | −0.130 | 0.691 | −1.313 | 0.043 | 0.691 | −0.478 | 0.107 | 0.691 |
| 1.906 | −0.138 | 0.691 | −1.392 | 0.075 | 0.691 | −0.367 | 0.095 | 0.691 |
| 1.892 | −0.144 | 0.691 | −1.462 | 0.106 | 0.691 | −0.255 | 0.083 | 0.691 |
| 1.872 | −0.146 | 0.691 | −1.525 | 0.134 | 0.691 | −0.144 | 0.071 | 0.691 |
| 1.847 | −0.148 | 0.691 | −1.580 | 0.162 | 0.691 | −0.033 | 0.061 | 0.691 |
| 1.817 | −0.150 | 0.691 | −1.631 | 0.189 | 0.691 | 0.079 | 0.051 | 0.691 |
| 1.781 | −0.153 | 0.691 | −1.674 | 0.215 | 0.691 | 0.191 | 0.042 | 0.691 |
| 1.739 | −0.156 | 0.691 | −1.706 | 0.237 | 0.691 | 0.302 | 0.033 | 0.691 |
| 1.689 | −0.160 | 0.691 | −1.729 | 0.256 | 0.691 | 0.414 | 0.024 | 0.691 |
| 1.632 | −0.165 | 0.691 | −1.746 | 0.272 | 0.691 | 0.525 | 0.016 | 0.691 |
| 1.567 | −0.170 | 0.691 | −1.756 | 0.286 | 0.691 | 0.637 | 0.007 | 0.691 |
| 1.494 | −0.175 | 0.691 | −1.760 | 0.295 | 0.691 | 0.749 | −0.001 | 0.691 |
| 1.414 | −0.181 | 0.691 | −1.761 | 0.301 | 0.691 | 0.857 | −0.008 | 0.691 |
| 1.326 | −0.187 | 0.691 | −1.761 | 0.304 | 0.691 | 0.961 | −0.016 | 0.691 |
| 1.234 | −0.194 | 0.691 | −1.760 | 0.305 | 0.691 | 1.061 | −0.023 | 0.691 |
| 1.139 | −0.200 | 0.691 | −1.760 | 0.306 | 0.691 | 1.158 | −0.029 | 0.691 |
| 1.040 | −0.207 | 0.691 | −1.760 | 0.307 | 0.691 | 1.251 | −0.035 | 0.691 |
| 0.936 | −0.214 | 0.691 | −1.759 | 0.308 | 0.691 | 1.341 | −0.041 | 0.691 |
| 0.829 | −0.221 | 0.691 | −1.757 | 0.311 | 0.691 | 1.426 | −0.046 | 0.691 |
| 0.718 | −0.227 | 0.691 | −1.752 | 0.315 | 0.691 | 1.505 | −0.051 | 0.691 |
| 0.604 | −0.232 | 0.691 | −1.744 | 0.318 | 0.691 | 1.575 | −0.055 | 0.691 |
| 0.489 | −0.236 | 0.691 | −1.727 | 0.322 | 0.691 | 1.639 | −0.059 | 0.691 |
| 0.374 | −0.238 | 0.691 | −1.705 | 0.323 | 0.691 | 1.695 | −0.062 | 0.691 |
| 0.259 | −0.239 | 0.691 | −1.675 | 0.321 | 0.691 | 1.743 | −0.065 | 0.691 |
| 0.144 | −0.238 | 0.691 | −1.638 | 0.317 | 0.691 | 1.784 | −0.067 | 0.691 |
| 0.029 | −0.234 | 0.691 | −1.590 | 0.309 | 0.691 | 1.819 | −0.069 | 0.691 |
| −0.085 | −0.228 | 0.691 | −1.535 | 0.298 | 0.691 | 1.849 | −0.070 | 0.691 |
| −0.200 | −0.219 | 0.691 | −1.477 | 0.285 | 0.691 | 1.873 | −0.071 | 0.691 |
| −0.314 | −0.207 | 0.691 | −1.411 | 0.271 | 0.691 | 1.892 | −0.073 | 0.691 |
| −0.427 | −0.192 | 0.691 | −1.338 | 0.255 | 0.691 | 1.905 | −0.079 | 0.691 |
| −0.540 | −0.173 | 0.691 | −1.258 | 0.237 | 0.691 | 1.913 | −0.087 | 0.691 |

TABLE 14R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.652 | −0.152 | 0.691 | −1.174 | 0.220 | 0.691 | 1.918 | −0.095 | 0.691 |
| −0.759 | −0.129 | 0.691 | −1.086 | 0.202 | 0.691 | 1.920 | −0.102 | 0.691 |
| −0.862 | −0.104 | 0.691 | −0.995 | 0.185 | 0.691 | | | |
| −0.961 | −0.077 | 0.691 | −0.899 | 0.168 | 0.691 | | | |
| 1.896 | −0.173 | 1.037 | −1.048 | −0.015 | 1.037 | −0.792 | 0.173 | 1.037 |
| 1.896 | −0.179 | 1.037 | −1.136 | 0.016 | 1.037 | −0.690 | 0.154 | 1.037 |
| 1.894 | −0.186 | 1.037 | −1.221 | 0.047 | 1.037 | −0.584 | 0.137 | 1.037 |
| 1.889 | −0.194 | 1.037 | −1.301 | 0.079 | 1.037 | −0.475 | 0.119 | 1.037 |
| 1.881 | −0.202 | 1.037 | −1.378 | 0.111 | 1.037 | −0.365 | 0.103 | 1.037 |
| 1.866 | −0.207 | 1.037 | −1.447 | 0.141 | 1.037 | −0.255 | 0.087 | 1.037 |
| 1.847 | −0.208 | 1.037 | −1.509 | 0.170 | 1.037 | −0.145 | 0.073 | 1.037 |
| 1.822 | −0.210 | 1.037 | −1.564 | 0.197 | 1.037 | −0.035 | 0.058 | 1.037 |
| 1.792 | −0.211 | 1.037 | −1.614 | 0.224 | 1.037 | 0.075 | 0.045 | 1.037 |
| 1.757 | −0.213 | 1.037 | −1.657 | 0.250 | 1.037 | 0.186 | 0.031 | 1.037 |
| 1.715 | −0.214 | 1.037 | −1.688 | 0.271 | 1.037 | 0.296 | 0.018 | 1.037 |
| 1.666 | −0.217 | 1.037 | −1.712 | 0.290 | 1.037 | 0.406 | 0.006 | 1.037 |
| 1.609 | −0.219 | 1.037 | −1.728 | 0.306 | 1.037 | 0.517 | −0.007 | 1.037 |
| 1.544 | −0.222 | 1.037 | −1.739 | 0.320 | 1.037 | 0.627 | −0.019 | 1.037 |
| 1.472 | −0.225 | 1.037 | −1.743 | 0.329 | 1.037 | 0.737 | −0.030 | 1.037 |
| 1.393 | −0.228 | 1.037 | −1.743 | 0.335 | 1.037 | 0.844 | −0.042 | 1.037 |
| 1.305 | −0.232 | 1.037 | −1.743 | 0.338 | 1.037 | 0.947 | −0.053 | 1.037 |
| 1.215 | −0.235 | 1.037 | −1.743 | 0.339 | 1.037 | 1.047 | −0.063 | 1.037 |
| 1.120 | −0.239 | 1.037 | −1.742 | 0.340 | 1.037 | 1.142 | −0.073 | 1.037 |
| 1.021 | −0.242 | 1.037 | −1.742 | 0.341 | 1.037 | 1.234 | −0.082 | 1.037 |
| 0.919 | −0.246 | 1.037 | −1.741 | 0.342 | 1.037 | 1.323 | −0.090 | 1.037 |
| 0.813 | −0.248 | 1.037 | −1.740 | 0.344 | 1.037 | 1.408 | −0.098 | 1.037 |
| 0.703 | −0.250 | 1.037 | −1.735 | 0.348 | 1.037 | 1.485 | −0.105 | 1.037 |
| 0.589 | −0.251 | 1.037 | −1.726 | 0.352 | 1.037 | 1.555 | −0.111 | 1.037 |
| 0.475 | −0.251 | 1.037 | −1.710 | 0.355 | 1.037 | 1.618 | −0.117 | 1.037 |
| 0.362 | −0.249 | 1.037 | −1.688 | 0.356 | 1.037 | 1.673 | −0.122 | 1.037 |
| 0.248 | −0.245 | 1.037 | −1.658 | 0.354 | 1.037 | 1.721 | −0.126 | 1.037 |
| 0.134 | −0.239 | 1.037 | −1.621 | 0.349 | 1.037 | 1.762 | −0.129 | 1.037 |
| 0.021 | −0.231 | 1.037 | −1.574 | 0.341 | 1.037 | 1.796 | −0.132 | 1.037 |
| −0.092 | −0.220 | 1.037 | −1.520 | 0.330 | 1.037 | 1.825 | −0.134 | 1.037 |
| −0.206 | −0.207 | 1.037 | −1.462 | 0.317 | 1.037 | 1.849 | −0.136 | 1.037 |
| −0.318 | −0.191 | 1.037 | −1.397 | 0.301 | 1.037 | 1.869 | −0.138 | 1.037 |
| −0.430 | −0.173 | 1.037 | −1.325 | 0.284 | 1.037 | 1.882 | −0.144 | 1.037 |
| −0.541 | −0.151 | 1.037 | −1.246 | 0.266 | 1.037 | 1.890 | −0.152 | 1.037 |
| −0.651 | −0.127 | 1.037 | −1.162 | 0.247 | 1.037 | 1.894 | −0.160 | 1.037 |
| −0.756 | −0.101 | 1.037 | −1.076 | 0.229 | 1.037 | 1.896 | −0.168 | 1.037 |
| −0.858 | −0.074 | 1.037 | −0.985 | 0.210 | 1.037 | | | |
| −0.955 | −0.045 | 1.037 | −0.891 | 0.191 | 1.037 | | | |
| 1.874 | −0.355 | 1.728 | −0.973 | 0.006 | 1.728 | −0.719 | 0.178 | 1.728 |
| 1.873 | −0.360 | 1.728 | −1.059 | 0.040 | 1.728 | −0.620 | 0.155 | 1.728 |
| 1.870 | −0.367 | 1.728 | −1.140 | 0.075 | 1.728 | −0.518 | 0.132 | 1.728 |
| 1.864 | −0.374 | 1.728 | −1.218 | 0.109 | 1.728 | −0.413 | 0.108 | 1.728 |
| 1.854 | −0.379 | 1.728 | −1.291 | 0.143 | 1.728 | −0.307 | 0.085 | 1.728 |
| 1.840 | −0.380 | 1.728 | −1.357 | 0.175 | 1.728 | −0.201 | 0.063 | 1.728 |
| 1.820 | −0.380 | 1.728 | −1.416 | 0.206 | 1.728 | −0.095 | 0.040 | 1.728 |
| 1.797 | −0.379 | 1.728 | −1.468 | 0.233 | 1.728 | 0.011 | 0.018 | 1.728 |
| 1.767 | −0.379 | 1.728 | −1.516 | 0.261 | 1.728 | 0.117 | −0.004 | 1.728 |
| 1.733 | −0.378 | 1.728 | −1.557 | 0.287 | 1.728 | 0.223 | −0.025 | 1.728 |
| 1.693 | −0.377 | 1.728 | −1.587 | 0.308 | 1.728 | 0.329 | −0.046 | 1.728 |
| 1.645 | −0.377 | 1.728 | −1.609 | 0.327 | 1.728 | 0.435 | −0.067 | 1.728 |
| 1.590 | −0.376 | 1.728 | −1.625 | 0.342 | 1.728 | 0.541 | −0.088 | 1.728 |
| 1.527 | −0.375 | 1.728 | −1.635 | 0.356 | 1.728 | 0.648 | −0.109 | 1.728 |
| 1.457 | −0.373 | 1.728 | −1.639 | 0.364 | 1.728 | 0.754 | −0.130 | 1.728 |
| 1.380 | −0.371 | 1.728 | −1.640 | 0.370 | 1.728 | 0.857 | −0.150 | 1.728 |
| 1.296 | −0.369 | 1.728 | −1.639 | 0.373 | 1.728 | 0.956 | −0.169 | 1.728 |
| 1.207 | −0.366 | 1.728 | −1.639 | 0.374 | 1.728 | 1.052 | −0.187 | 1.728 |
| 1.115 | −0.364 | 1.728 | −1.639 | 0.375 | 1.728 | 1.144 | −0.204 | 1.728 |
| 1.020 | −0.360 | 1.728 | −1.638 | 0.376 | 1.728 | 1.233 | −0.220 | 1.728 |
| 0.921 | −0.356 | 1.728 | −1.638 | 0.377 | 1.728 | 1.318 | −0.235 | 1.728 |
| 0.818 | −0.351 | 1.728 | −1.636 | 0.379 | 1.728 | 1.400 | −0.250 | 1.728 |
| 0.712 | −0.345 | 1.728 | −1.631 | 0.383 | 1.728 | 1.474 | −0.262 | 1.728 |
| 0.602 | −0.337 | 1.728 | −1.623 | 0.386 | 1.728 | 1.542 | −0.274 | 1.728 |
| 0.492 | −0.329 | 1.728 | −1.606 | 0.388 | 1.728 | 1.603 | −0.284 | 1.728 |
| 0.382 | −0.318 | 1.728 | −1.585 | 0.387 | 1.728 | 1.656 | −0.293 | 1.728 |
| 0.273 | −0.306 | 1.728 | −1.556 | 0.385 | 1.728 | 1.702 | −0.300 | 1.728 |
| 0.164 | −0.291 | 1.728 | −1.520 | 0.379 | 1.728 | 1.741 | −0.307 | 1.728 |
| 0.055 | −0.275 | 1.728 | −1.474 | 0.369 | 1.728 | 1.775 | −0.312 | 1.728 |
| −0.054 | −0.256 | 1.728 | −1.422 | 0.357 | 1.728 | 1.803 | −0.317 | 1.728 |
| −0.163 | −0.235 | 1.728 | −1.366 | 0.343 | 1.728 | 1.826 | −0.321 | 1.728 |
| −0.270 | −0.212 | 1.728 | −1.303 | 0.326 | 1.728 | 1.845 | −0.324 | 1.728 |
| −0.378 | −0.186 | 1.728 | −1.233 | 0.308 | 1.728 | 1.859 | −0.327 | 1.728 |
| −0.484 | −0.157 | 1.728 | −1.156 | 0.287 | 1.728 | 1.867 | −0.334 | 1.728 |
| −0.591 | −0.127 | 1.728 | −1.076 | 0.266 | 1.728 | 1.872 | −0.342 | 1.728 |

TABLE 14R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.693 | −0.095 | 1.728 | −0.992 | 0.245 | 1.728 | 1.874 | −0.349 | 1.728 |
| −0.790 | −0.062 | 1.728 | −0.905 | 0.223 | 1.728 | | | |
| −0.884 | −0.028 | 1.728 | −0.814 | 0.201 | 1.728 | | | |
| 1.876 | −0.444 | 2.073 | −0.927 | −0.004 | 2.073 | −0.677 | 0.161 | 2.073 |
| 1.875 | −0.449 | 2.073 | −1.012 | 0.032 | 2.073 | −0.580 | 0.136 | 2.073 |
| 1.872 | −0.455 | 2.073 | −1.092 | 0.069 | 2.073 | −0.480 | 0.110 | 2.073 |
| 1.865 | −0.461 | 2.073 | −1.168 | 0.104 | 2.073 | −0.376 | 0.085 | 2.073 |
| 1.855 | −0.465 | 2.073 | −1.241 | 0.140 | 2.073 | −0.271 | 0.060 | 2.073 |
| 1.840 | −0.465 | 2.073 | −1.306 | 0.173 | 2.073 | −0.167 | 0.035 | 2.073 |
| 1.821 | −0.464 | 2.073 | −1.365 | 0.205 | 2.073 | −0.063 | 0.010 | 2.073 |
| 1.797 | −0.463 | 2.073 | −1.416 | 0.234 | 2.073 | 0.042 | −0.015 | 2.073 |
| 1.769 | −0.462 | 2.073 | −1.463 | 0.262 | 2.073 | 0.146 | −0.040 | 2.073 |
| 1.735 | −0.460 | 2.073 | −1.503 | 0.288 | 2.073 | 0.251 | −0.064 | 2.073 |
| 1.694 | −0.458 | 2.073 | −1.533 | 0.310 | 2.073 | 0.355 | −0.089 | 2.073 |
| 1.647 | −0.456 | 2.073 | −1.555 | 0.329 | 2.073 | 0.460 | −0.113 | 2.073 |
| 1.593 | −0.454 | 2.073 | −1.571 | 0.344 | 2.073 | 0.564 | −0.138 | 2.073 |
| 1.531 | −0.451 | 2.073 | −1.581 | 0.357 | 2.073 | 0.668 | −0.162 | 2.073 |
| 1.462 | −0.447 | 2.073 | −1.585 | 0.365 | 2.073 | 0.773 | −0.186 | 2.073 |
| 1.385 | −0.443 | 2.073 | −1.586 | 0.371 | 2.073 | 0.874 | −0.209 | 2.073 |
| 1.302 | −0.438 | 2.073 | −1.586 | 0.374 | 2.073 | 0.972 | −0.232 | 2.073 |
| 1.214 | −0.434 | 2.073 | −1.586 | 0.375 | 2.073 | 1.066 | −0.253 | 2.073 |
| 1.123 | −0.428 | 2.073 | −1.585 | 0.376 | 2.073 | 1.157 | −0.273 | 2.073 |
| 1.029 | −0.422 | 2.073 | −1.585 | 0.377 | 2.073 | 1.244 | −0.292 | 2.073 |
| 0.931 | −0.415 | 2.073 | −1.584 | 0.378 | 2.073 | 1.328 | −0.310 | 2.073 |
| 0.830 | −0.407 | 2.073 | −1.582 | 0.380 | 2.073 | 1.408 | −0.327 | 2.073 |
| 0.725 | −0.398 | 2.073 | −1.577 | 0.383 | 2.073 | 1.482 | −0.342 | 2.073 |
| 0.617 | −0.387 | 2.073 | −1.569 | 0.386 | 2.073 | 1.549 | −0.356 | 2.073 |
| 0.509 | −0.374 | 2.073 | −1.552 | 0.387 | 2.073 | 1.608 | −0.368 | 2.073 |
| 0.401 | −0.360 | 2.073 | −1.531 | 0.386 | 2.073 | 1.661 | −0.378 | 2.073 |
| 0.294 | −0.345 | 2.073 | −1.503 | 0.382 | 2.073 | 1.706 | −0.387 | 2.073 |
| 0.187 | −0.327 | 2.073 | −1.468 | 0.375 | 2.073 | 1.745 | −0.395 | 2.073 |
| 0.080 | −0.308 | 2.073 | −1.422 | 0.365 | 2.073 | 1.778 | −0.402 | 2.073 |
| −0.026 | −0.286 | 2.073 | −1.370 | 0.351 | 2.073 | 1.806 | −0.407 | 2.073 |
| −0.132 | −0.263 | 2.073 | −1.315 | 0.336 | 2.073 | 1.828 | −0.411 | 2.073 |
| −0.237 | −0.237 | 2.073 | −1.253 | 0.319 | 2.073 | 1.847 | −0.415 | 2.073 |
| −0.342 | −0.208 | 2.073 | −1.184 | 0.299 | 2.073 | 1.861 | −0.418 | 2.073 |
| −0.446 | −0.177 | 2.073 | −1.109 | 0.277 | 2.073 | 1.870 | −0.424 | 2.073 |
| −0.550 | −0.144 | 2.073 | −1.030 | 0.255 | 2.073 | 1.874 | −0.431 | 2.073 |
| −0.650 | −0.110 | 2.073 | −0.947 | 0.232 | 2.073 | 1.876 | −0.438 | 2.073 |
| −0.746 | −0.075 | 2.073 | −0.861 | 0.209 | 2.073 | | | |
| −0.839 | −0.040 | 2.073 | −0.771 | 0.185 | 2.073 | | | |
| 1.889 | −0.571 | 2.764 | −0.864 | −0.031 | 2.764 | −0.618 | 0.103 | 2.764 |
| 1.888 | −0.577 | 2.764 | −0.946 | 0.007 | 2.764 | −0.523 | 0.075 | 2.764 |
| 1.884 | −0.583 | 2.764 | −1.024 | 0.045 | 2.764 | −0.425 | 0.046 | 2.764 |
| 1.877 | −0.588 | 2.764 | −1.098 | 0.082 | 2.764 | −0.323 | 0.017 | 2.764 |
| 1.866 | −0.590 | 2.764 | −1.169 | 0.119 | 2.764 | −0.220 | −0.011 | 2.764 |
| 1.852 | −0.589 | 2.764 | −1.233 | 0.153 | 2.764 | −0.118 | −0.039 | 2.764 |
| 1.833 | −0.588 | 2.764 | −1.289 | 0.185 | 2.764 | −0.016 | −0.067 | 2.764 |
| 1.810 | −0.586 | 2.764 | −1.339 | 0.215 | 2.764 | 0.087 | −0.095 | 2.764 |
| 1.782 | −0.584 | 2.764 | −1.386 | 0.243 | 2.764 | 0.189 | −0.123 | 2.764 |
| 1.748 | −0.581 | 2.764 | −1.425 | 0.269 | 2.764 | 0.292 | −0.151 | 2.764 |
| 1.709 | −0.578 | 2.764 | −1.454 | 0.290 | 2.764 | 0.394 | −0.178 | 2.764 |
| 1.662 | −0.574 | 2.764 | −1.476 | 0.309 | 2.764 | 0.497 | −0.205 | 2.764 |
| 1.608 | −0.570 | 2.764 | −1.492 | 0.324 | 2.764 | 0.599 | −0.232 | 2.764 |
| 1.547 | −0.565 | 2.764 | −1.502 | 0.336 | 2.764 | 0.702 | −0.259 | 2.764 |
| 1.479 | −0.559 | 2.764 | −1.507 | 0.344 | 2.764 | 0.804 | −0.286 | 2.764 |
| 1.404 | −0.552 | 2.764 | −1.508 | 0.350 | 2.764 | 0.904 | −0.312 | 2.764 |
| 1.322 | −0.544 | 2.764 | −1.508 | 0.353 | 2.764 | 1.000 | −0.337 | 2.764 |
| 1.236 | −0.536 | 2.764 | −1.508 | 0.354 | 2.764 | 1.092 | −0.361 | 2.764 |
| 1.147 | −0.527 | 2.764 | −1.507 | 0.355 | 2.764 | 1.181 | −0.384 | 2.764 |
| 1.054 | −0.517 | 2.764 | −1.507 | 0.355 | 2.764 | 1.267 | −0.405 | 2.764 |
| 0.957 | −0.507 | 2.764 | −1.506 | 0.357 | 2.764 | 1.349 | −0.426 | 2.764 |
| 0.858 | −0.495 | 2.764 | −1.504 | 0.359 | 2.764 | 1.428 | −0.445 | 2.764 |
| 0.755 | −0.482 | 2.764 | −1.499 | 0.361 | 2.764 | 1.501 | −0.462 | 2.764 |
| 0.648 | −0.467 | 2.764 | −1.490 | 0.362 | 2.764 | 1.566 | −0.477 | 2.764 |
| 0.542 | −0.451 | 2.764 | −1.474 | 0.362 | 2.764 | 1.625 | −0.491 | 2.764 |
| 0.436 | −0.433 | 2.764 | −1.453 | 0.360 | 2.764 | 1.676 | −0.503 | 2.764 |
| 0.331 | −0.413 | 2.764 | −1.425 | 0.354 | 2.764 | 1.721 | −0.513 | 2.764 |
| 0.226 | −0.392 | 2.764 | −1.391 | 0.346 | 2.764 | 1.759 | −0.522 | 2.764 |
| 0.122 | −0.368 | 2.764 | −1.347 | 0.333 | 2.764 | 1.792 | −0.529 | 2.764 |
| 0.018 | −0.343 | 2.764 | −1.296 | 0.317 | 2.764 | 1.819 | −0.535 | 2.764 |
| −0.086 | −0.315 | 2.764 | −1.242 | 0.300 | 2.764 | 1.841 | −0.540 | 2.764 |
| −0.189 | −0.285 | 2.764 | −1.182 | 0.280 | 2.764 | 1.859 | −0.544 | 2.764 |
| −0.292 | −0.253 | 2.764 | −1.114 | 0.258 | 2.764 | 1.873 | −0.547 | 2.764 |
| −0.394 | −0.218 | 2.764 | −1.041 | 0.234 | 2.764 | 1.882 | −0.552 | 2.764 |
| −0.496 | −0.182 | 2.764 | −0.963 | 0.209 | 2.764 | 1.888 | −0.559 | 2.764 |
| −0.594 | −0.145 | 2.764 | −0.882 | 0.183 | 2.764 | 1.889 | −0.566 | 2.764 |

TABLE 14R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.688 | −0.107 | 2.764 | −0.798 | 0.157 | 2.764 | | | |
| −0.778 | −0.069 | 2.764 | −0.710 | 0.130 | 2.764 | | | |
| 1.927 | −0.634 | 3.456 | −0.805 | −0.090 | 3.456 | −0.571 | 0.017 | 3.456 |
| 1.926 | −0.639 | 3.456 | −0.887 | −0.054 | 3.456 | −0.476 | −0.011 | 3.456 |
| 1.922 | −0.645 | 3.456 | −0.965 | −0.018 | 3.456 | −0.378 | −0.040 | 3.456 |
| 1.915 | −0.651 | 3.456 | −1.039 | 0.017 | 3.456 | −0.277 | −0.069 | 3.456 |
| 1.904 | −0.652 | 3.456 | −1.110 | 0.052 | 3.456 | −0.175 | −0.097 | 3.456 |
| 1.890 | −0.651 | 3.456 | −1.174 | 0.085 | 3.456 | −0.074 | −0.125 | 3.456 |
| 1.872 | −0.649 | 3.456 | −1.231 | 0.115 | 3.456 | 0.028 | −0.153 | 3.456 |
| 1.848 | −0.647 | 3.456 | −1.281 | 0.142 | 3.456 | 0.130 | −0.180 | 3.456 |
| 1.820 | −0.645 | 3.456 | −1.328 | 0.169 | 3.456 | 0.232 | −0.207 | 3.456 |
| 1.787 | −0.642 | 3.456 | −1.368 | 0.193 | 3.456 | 0.334 | −0.234 | 3.456 |
| 1.748 | −0.639 | 3.456 | −1.397 | 0.213 | 3.456 | 0.436 | −0.261 | 3.456 |
| 1.702 | −0.635 | 3.456 | −1.420 | 0.230 | 3.456 | 0.538 | −0.287 | 3.456 |
| 1.649 | −0.630 | 3.456 | −1.437 | 0.244 | 3.456 | 0.640 | −0.313 | 3.456 |
| 1.588 | −0.624 | 3.456 | −1.447 | 0.256 | 3.456 | 0.742 | −0.339 | 3.456 |
| 1.521 | −0.617 | 3.456 | −1.452 | 0.264 | 3.456 | 0.845 | −0.365 | 3.456 |
| 1.446 | −0.610 | 3.456 | −1.454 | 0.269 | 3.456 | 0.944 | −0.390 | 3.456 |
| 1.365 | −0.602 | 3.456 | −1.454 | 0.272 | 3.456 | 1.039 | −0.413 | 3.456 |
| 1.280 | −0.593 | 3.456 | −1.453 | 0.273 | 3.456 | 1.132 | −0.436 | 3.456 |
| 1.191 | −0.583 | 3.456 | −1.453 | 0.274 | 3.456 | 1.220 | −0.457 | 3.456 |
| 1.099 | −0.573 | 3.456 | −1.453 | 0.275 | 3.456 | 1.306 | −0.478 | 3.456 |
| 1.004 | −0.562 | 3.456 | −1.452 | 0.276 | 3.456 | 1.388 | −0.497 | 3.456 |
| 0.905 | −0.549 | 3.456 | −1.450 | 0.278 | 3.456 | 1.467 | −0.515 | 3.456 |
| 0.803 | −0.535 | 3.456 | −1.445 | 0.280 | 3.456 | 1.539 | −0.531 | 3.456 |
| 0.698 | −0.519 | 3.456 | −1.436 | 0.281 | 3.456 | 1.604 | −0.546 | 3.456 |
| 0.593 | −0.502 | 3.456 | −1.420 | 0.281 | 3.456 | 1.663 | −0.558 | 3.456 |
| 0.488 | −0.484 | 3.456 | −1.399 | 0.278 | 3.456 | 1.714 | −0.570 | 3.456 |
| 0.383 | −0.463 | 3.456 | −1.371 | 0.272 | 3.456 | 1.759 | −0.579 | 3.456 |
| 0.279 | −0.441 | 3.456 | −1.338 | 0.262 | 3.456 | 1.797 | −0.587 | 3.456 |
| 0.175 | −0.418 | 3.456 | −1.294 | 0.249 | 3.456 | 1.829 | −0.594 | 3.456 |
| 0.072 | −0.392 | 3.456 | −1.244 | 0.233 | 3.456 | 1.856 | −0.599 | 3.456 |
| −0.031 | −0.365 | 3.456 | −1.190 | 0.215 | 3.456 | 1.879 | −0.604 | 3.456 |
| −0.133 | −0.335 | 3.456 | −1.130 | 0.195 | 3.456 | 1.897 | −0.608 | 3.456 |
| −0.236 | −0.304 | 3.456 | −1.064 | 0.173 | 3.456 | 1.910 | −0.611 | 3.456 |
| −0.337 | −0.270 | 3.456 | −0.990 | 0.149 | 3.456 | 1.920 | −0.615 | 3.456 |
| −0.439 | −0.235 | 3.456 | −0.913 | 0.123 | 3.456 | 1.925 | −0.622 | 3.456 |
| −0.536 | −0.199 | 3.456 | −0.833 | 0.098 | 3.456 | 1.927 | −0.629 | 3.456 |
| −0.629 | −0.163 | 3.456 | −0.749 | 0.071 | 3.456 | | | |
| −0.719 | −0.126 | 3.456 | −0.662 | 0.044 | 3.456 | | | |
| 1.949 | −0.691 | 4.147 | −0.765 | −0.134 | 4.147 | −0.539 | −0.051 | 4.147 |
| 1.947 | −0.696 | 4.147 | −0.847 | −0.099 | 4.147 | −0.446 | −0.079 | 4.147 |
| 1.943 | −0.702 | 4.147 | −0.925 | −0.065 | 4.147 | −0.348 | −0.107 | 4.147 |
| 1.936 | −0.706 | 4.147 | −0.999 | −0.031 | 4.147 | −0.247 | −0.137 | 4.147 |
| 1.925 | −0.707 | 4.147 | −1.070 | 0.003 | 4.147 | −0.146 | −0.165 | 4.147 |
| 1.911 | −0.706 | 4.147 | −1.134 | 0.034 | 4.147 | −0.045 | −0.193 | 4.147 |
| 1.893 | −0.704 | 4.147 | −1.191 | 0.062 | 4.147 | 0.056 | −0.221 | 4.147 |
| 1.870 | −0.702 | 4.147 | −1.241 | 0.088 | 4.147 | 0.157 | −0.248 | 4.147 |
| 1.842 | −0.699 | 4.147 | −1.288 | 0.113 | 4.147 | 0.259 | −0.275 | 4.147 |
| 1.809 | −0.696 | 4.147 | −1.328 | 0.136 | 4.147 | 0.360 | −0.302 | 4.147 |
| 1.771 | −0.692 | 4.147 | −1.359 | 0.154 | 4.147 | 0.462 | −0.328 | 4.147 |
| 1.725 | −0.688 | 4.147 | −1.382 | 0.171 | 4.147 | 0.564 | −0.354 | 4.147 |
| 1.672 | −0.682 | 4.147 | −1.398 | 0.184 | 4.147 | 0.666 | −0.380 | 4.147 |
| 1.612 | −0.676 | 4.147 | −1.410 | 0.195 | 4.147 | 0.767 | −0.406 | 4.147 |
| 1.545 | −0.669 | 4.147 | −1.415 | 0.203 | 4.147 | 0.869 | −0.431 | 4.147 |
| 1.471 | −0.661 | 4.147 | −1.417 | 0.208 | 4.147 | 0.968 | −0.455 | 4.147 |
| 1.391 | −0.652 | 4.147 | −1.417 | 0.211 | 4.147 | 1.063 | −0.478 | 4.147 |
| 1.306 | −0.642 | 4.147 | −1.416 | 0.212 | 4.147 | 1.155 | −0.499 | 4.147 |
| 1.218 | −0.632 | 4.147 | −1.416 | 0.213 | 4.147 | 1.244 | −0.520 | 4.147 |
| 1.127 | −0.620 | 4.147 | −1.416 | 0.213 | 4.147 | 1.329 | −0.540 | 4.147 |
| 1.033 | −0.608 | 4.147 | −1.415 | 0.215 | 4.147 | 1.411 | −0.558 | 4.147 |
| 0.935 | −0.594 | 4.147 | −1.413 | 0.216 | 4.147 | 1.490 | −0.576 | 4.147 |
| 0.833 | −0.579 | 4.147 | −1.407 | 0.218 | 4.147 | 1.561 | −0.591 | 4.147 |
| 0.729 | −0.561 | 4.147 | −1.399 | 0.219 | 4.147 | 1.627 | −0.605 | 4.147 |
| 0.624 | −0.543 | 4.147 | −1.383 | 0.218 | 4.147 | 1.685 | −0.617 | 4.147 |
| 0.520 | −0.523 | 4.147 | −1.362 | 0.215 | 4.147 | 1.736 | −0.628 | 4.147 |
| 0.417 | −0.502 | 4.147 | −1.335 | 0.209 | 4.147 | 1.781 | −0.637 | 4.147 |
| 0.313 | −0.479 | 4.147 | −1.301 | 0.199 | 4.147 | 1.818 | −0.645 | 4.147 |
| 0.210 | −0.455 | 4.147 | −1.258 | 0.185 | 4.147 | 1.851 | −0.652 | 4.147 |
| 0.107 | −0.429 | 4.147 | −1.208 | 0.168 | 4.147 | 1.878 | −0.657 | 4.147 |
| 0.004 | −0.401 | 4.147 | −1.155 | 0.150 | 4.147 | 1.900 | −0.661 | 4.147 |
| −0.098 | −0.372 | 4.147 | −1.096 | 0.129 | 4.147 | 1.918 | −0.665 | 4.147 |
| −0.200 | −0.341 | 4.147 | −1.029 | 0.107 | 4.147 | 1.932 | −0.668 | 4.147 |
| −0.301 | −0.308 | 4.147 | −0.956 | 0.082 | 4.147 | 1.941 | −0.672 | 4.147 |
| −0.401 | −0.273 | 4.147 | −0.880 | 0.057 | 4.147 | 1.947 | −0.679 | 4.147 |
| −0.498 | −0.239 | 4.147 | −0.800 | 0.031 | 4.147 | 1.949 | −0.685 | 4.147 |
| −0.591 | −0.204 | 4.147 | −0.717 | 0.004 | 4.147 | | | |

TABLE 14R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.680 | −0.169 | 4.147 | −0.630 | −0.023 | 4.147 | | | |
| 1.935 | −0.724 | 4.665 | −0.760 | −0.134 | 4.665 | −0.538 | −0.064 | 4.665 |
| 1.933 | −0.730 | 4.665 | −0.841 | −0.098 | 4.665 | −0.445 | −0.094 | 4.665 |
| 1.929 | −0.735 | 4.665 | −0.918 | −0.063 | 4.665 | −0.349 | −0.124 | 4.665 |
| 1.922 | −0.740 | 4.665 | −0.992 | −0.029 | 4.665 | −0.249 | −0.154 | 4.665 |
| 1.911 | −0.741 | 4.665 | −1.062 | 0.005 | 4.665 | −0.149 | −0.184 | 4.665 |
| 1.897 | −0.739 | 4.665 | −1.125 | 0.037 | 4.665 | −0.048 | −0.213 | 4.665 |
| 1.879 | −0.737 | 4.665 | −1.182 | 0.066 | 4.665 | 0.052 | −0.242 | 4.665 |
| 1.856 | −0.735 | 4.665 | −1.232 | 0.092 | 4.665 | 0.153 | −0.271 | 4.665 |
| 1.829 | −0.732 | 4.665 | −1.278 | 0.117 | 4.665 | 0.254 | −0.299 | 4.665 |
| 1.796 | −0.729 | 4.665 | −1.318 | 0.140 | 4.665 | 0.355 | −0.327 | 4.665 |
| 1.757 | −0.725 | 4.665 | −1.348 | 0.159 | 4.665 | 0.456 | −0.354 | 4.665 |
| 1.712 | −0.720 | 4.665 | −1.371 | 0.175 | 4.665 | 0.557 | −0.381 | 4.665 |
| 1.659 | −0.714 | 4.665 | −1.388 | 0.188 | 4.665 | 0.658 | −0.408 | 4.665 |
| 1.599 | −0.708 | 4.665 | −1.399 | 0.199 | 4.665 | 0.759 | −0.434 | 4.665 |
| 1.533 | −0.700 | 4.665 | −1.405 | 0.206 | 4.665 | 0.860 | −0.460 | 4.665 |
| 1.459 | −0.691 | 4.665 | −1.407 | 0.211 | 4.665 | 0.958 | −0.485 | 4.665 |
| 1.379 | −0.682 | 4.665 | −1.407 | 0.214 | 4.665 | 1.053 | −0.508 | 4.665 |
| 1.295 | −0.671 | 4.665 | −1.407 | 0.215 | 4.665 | 1.145 | −0.531 | 4.665 |
| 1.208 | −0.660 | 4.665 | −1.407 | 0.216 | 4.665 | 1.233 | −0.552 | 4.665 |
| 1.117 | −0.648 | 4.665 | −1.406 | 0.216 | 4.665 | 1.318 | −0.572 | 4.665 |
| 1.023 | −0.634 | 4.665 | −1.406 | 0.218 | 4.665 | 1.399 | −0.591 | 4.665 |
| 0.925 | −0.619 | 4.665 | −1.403 | 0.219 | 4.665 | 1.477 | −0.609 | 4.665 |
| 0.825 | −0.602 | 4.665 | −1.398 | 0.221 | 4.665 | 1.549 | −0.624 | 4.665 |
| 0.721 | −0.584 | 4.665 | −1.389 | 0.221 | 4.665 | 1.614 | −0.639 | 4.665 |
| 0.617 | −0.564 | 4.665 | −1.373 | 0.219 | 4.665 | 1.672 | −0.651 | 4.665 |
| 0.514 | −0.542 | 4.665 | −1.353 | 0.215 | 4.665 | 1.723 | −0.662 | 4.665 |
| 0.411 | −0.519 | 4.665 | −1.326 | 0.208 | 4.665 | 1.767 | −0.671 | 4.665 |
| 0.309 | −0.495 | 4.665 | −1.293 | 0.197 | 4.665 | 1.805 | −0.679 | 4.665 |
| 0.206 | −0.469 | 4.665 | −1.250 | 0.182 | 4.665 | 1.837 | −0.686 | 4.665 |
| 0.104 | −0.441 | 4.665 | −1.201 | 0.165 | 4.665 | 1.864 | −0.691 | 4.665 |
| 0.002 | −0.412 | 4.665 | −1.148 | 0.145 | 4.665 | 1.886 | −0.696 | 4.665 |
| −0.099 | −0.381 | 4.665 | −1.089 | 0.124 | 4.665 | 1.904 | −0.699 | 4.665 |
| −0.200 | −0.348 | 4.665 | −1.024 | 0.101 | 4.665 | 1.917 | −0.702 | 4.665 |
| −0.300 | −0.314 | 4.665 | −0.951 | 0.075 | 4.665 | 1.927 | −0.706 | 4.665 |
| −0.400 | −0.278 | 4.665 | −0.876 | 0.048 | 4.665 | 1.933 | −0.712 | 4.665 |
| −0.495 | −0.242 | 4.665 | −0.797 | 0.021 | 4.665 | 1.935 | −0.719 | 4.665 |
| −0.588 | −0.206 | 4.665 | −0.714 | −0.007 | 4.665 | | | |
| −0.676 | −0.170 | 4.665 | −0.628 | −0.035 | 4.665 | | | |
| 1.890 | −0.721 | 5.011 | −0.789 | −0.093 | 5.011 | −0.569 | −0.034 | 5.011 |
| 1.889 | −0.726 | 5.011 | −0.868 | −0.055 | 5.011 | −0.477 | −0.066 | 5.011 |
| 1.885 | −0.732 | 5.011 | −0.945 | −0.018 | 5.011 | −0.382 | −0.099 | 5.011 |
| 1.877 | −0.737 | 5.011 | −1.017 | 0.019 | 5.011 | −0.283 | −0.131 | 5.011 |
| 1.866 | −0.737 | 5.011 | −1.086 | 0.055 | 5.011 | −0.183 | −0.164 | 5.011 |
| 1.852 | −0.736 | 5.011 | −1.148 | 0.088 | 5.011 | −0.084 | −0.195 | 5.011 |
| 1.834 | −0.734 | 5.011 | −1.204 | 0.119 | 5.011 | 0.016 | −0.226 | 5.011 |
| 1.811 | −0.732 | 5.011 | −1.253 | 0.147 | 5.011 | 0.116 | −0.256 | 5.011 |
| 1.784 | −0.729 | 5.011 | −1.299 | 0.174 | 5.011 | 0.216 | −0.285 | 5.011 |
| 1.751 | −0.725 | 5.011 | −1.338 | 0.198 | 5.011 | 0.316 | −0.315 | 5.011 |
| 1.712 | −0.721 | 5.011 | −1.368 | 0.217 | 5.011 | 0.417 | −0.343 | 5.011 |
| 1.667 | −0.716 | 5.011 | −1.390 | 0.234 | 5.011 | 0.517 | −0.371 | 5.011 |
| 1.614 | −0.710 | 5.011 | −1.407 | 0.247 | 5.011 | 0.618 | −0.399 | 5.011 |
| 1.555 | −0.704 | 5.011 | −1.418 | 0.258 | 5.011 | 0.718 | −0.426 | 5.011 |
| 1.488 | −0.696 | 5.011 | −1.423 | 0.265 | 5.011 | 0.819 | −0.452 | 5.011 |
| 1.415 | −0.688 | 5.011 | −1.426 | 0.270 | 5.011 | 0.917 | −0.478 | 5.011 |
| 1.334 | −0.678 | 5.011 | −1.426 | 0.273 | 5.011 | 1.011 | −0.502 | 5.011 |
| 1.250 | −0.668 | 5.011 | −1.426 | 0.275 | 5.011 | 1.103 | −0.525 | 5.011 |
| 1.163 | −0.656 | 5.011 | −1.425 | 0.275 | 5.011 | 1.190 | −0.547 | 5.011 |
| 1.073 | −0.643 | 5.011 | −1.425 | 0.276 | 5.011 | 1.275 | −0.567 | 5.011 |
| 0.979 | −0.629 | 5.011 | −1.424 | 0.277 | 5.011 | 1.356 | −0.586 | 5.011 |
| 0.882 | −0.614 | 5.011 | −1.422 | 0.278 | 5.011 | 1.434 | −0.604 | 5.011 |
| 0.782 | −0.596 | 5.011 | −1.416 | 0.280 | 5.011 | 1.505 | −0.621 | 5.011 |
| 0.678 | −0.576 | 5.011 | −1.407 | 0.279 | 5.011 | 1.570 | −0.635 | 5.011 |
| 0.575 | −0.555 | 5.011 | −1.392 | 0.277 | 5.011 | 1.628 | −0.648 | 5.011 |
| 0.473 | −0.532 | 5.011 | −1.372 | 0.272 | 5.011 | 1.679 | −0.659 | 5.011 |
| 0.370 | −0.508 | 5.011 | −1.345 | 0.263 | 5.011 | 1.723 | −0.668 | 5.011 |
| 0.269 | −0.482 | 5.011 | −1.313 | 0.251 | 5.011 | 1.760 | −0.676 | 5.011 |
| 0.167 | −0.454 | 5.011 | −1.271 | 0.235 | 5.011 | 1.792 | −0.682 | 5.011 |
| 0.066 | −0.424 | 5.011 | −1.222 | 0.215 | 5.011 | 1.819 | −0.688 | 5.011 |
| −0.034 | −0.393 | 5.011 | −1.170 | 0.194 | 5.011 | 1.841 | −0.693 | 5.011 |
| −0.135 | −0.359 | 5.011 | −1.112 | 0.171 | 5.011 | 1.859 | −0.696 | 5.011 |
| −0.234 | −0.324 | 5.011 | −1.048 | 0.145 | 5.011 | 1.873 | −0.699 | 5.011 |
| −0.334 | −0.287 | 5.011 | −0.976 | 0.117 | 5.011 | 1.883 | −0.703 | 5.011 |
| −0.432 | −0.248 | 5.011 | −0.902 | 0.088 | 5.011 | 1.888 | −0.709 | 5.011 |
| −0.527 | −0.209 | 5.011 | −0.824 | 0.059 | 5.011 | 1.890 | −0.716 | 5.011 |
| −0.618 | −0.170 | 5.011 | −0.742 | 0.028 | 5.011 | | | |
| −0.705 | −0.132 | 5.011 | −0.658 | −0.003 | 5.011 | | | |

TABLE 14R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.803 | −0.701 | 5.529 | −0.868 | 0.007 | 5.529 | −0.649 | 0.047 | 5.529 |
| 1.802 | −0.706 | 5.529 | −0.946 | 0.050 | 5.529 | −0.559 | 0.010 | 5.529 |
| 1.797 | −0.711 | 5.529 | −1.020 | 0.092 | 5.529 | −0.465 | −0.027 | 5.529 |
| 1.789 | −0.716 | 5.529 | −1.091 | 0.134 | 5.529 | −0.367 | −0.065 | 5.529 |
| 1.779 | −0.716 | 5.529 | −1.158 | 0.174 | 5.529 | −0.268 | −0.101 | 5.529 |
| 1.765 | −0.714 | 5.529 | −1.219 | 0.211 | 5.529 | −0.169 | −0.136 | 5.529 |
| 1.746 | −0.712 | 5.529 | −1.273 | 0.245 | 5.529 | −0.070 | −0.170 | 5.529 |
| 1.723 | −0.710 | 5.529 | −1.321 | 0.276 | 5.529 | 0.029 | −0.204 | 5.529 |
| 1.696 | −0.707 | 5.529 | −1.365 | 0.306 | 5.529 | 0.128 | −0.237 | 5.529 |
| 1.662 | −0.704 | 5.529 | −1.403 | 0.333 | 5.529 | 0.228 | −0.268 | 5.529 |
| 1.624 | −0.699 | 5.529 | −1.432 | 0.354 | 5.529 | 0.328 | −0.299 | 5.529 |
| 1.578 | −0.694 | 5.529 | −1.454 | 0.372 | 5.529 | 0.429 | −0.330 | 5.529 |
| 1.525 | −0.688 | 5.529 | −1.470 | 0.386 | 5.529 | 0.529 | −0.359 | 5.529 |
| 1.465 | −0.681 | 5.529 | −1.481 | 0.398 | 5.529 | 0.630 | −0.388 | 5.529 |
| 1.398 | −0.673 | 5.529 | −1.486 | 0.405 | 5.529 | 0.731 | −0.417 | 5.529 |
| 1.324 | −0.665 | 5.529 | −1.488 | 0.410 | 5.529 | 0.828 | −0.444 | 5.529 |
| 1.243 | −0.655 | 5.529 | −1.489 | 0.413 | 5.529 | 0.923 | −0.470 | 5.529 |
| 1.159 | −0.643 | 5.529 | −1.488 | 0.414 | 5.529 | 1.014 | −0.494 | 5.529 |
| 1.071 | −0.631 | 5.529 | −1.488 | 0.415 | 5.529 | 1.102 | −0.518 | 5.529 |
| 0.980 | −0.617 | 5.529 | −1.488 | 0.415 | 5.529 | 1.186 | −0.540 | 5.529 |
| 0.886 | −0.601 | 5.529 | −1.486 | 0.416 | 5.529 | 1.268 | −0.560 | 5.529 |
| 0.789 | −0.584 | 5.529 | −1.484 | 0.417 | 5.529 | 1.346 | −0.580 | 5.529 |
| 0.689 | −0.564 | 5.529 | −1.478 | 0.418 | 5.529 | 1.417 | −0.597 | 5.529 |
| 0.585 | −0.542 | 5.529 | −1.470 | 0.416 | 5.529 | 1.482 | −0.612 | 5.529 |
| 0.482 | −0.518 | 5.529 | −1.454 | 0.412 | 5.529 | 1.540 | −0.625 | 5.529 |
| 0.380 | −0.493 | 5.529 | −1.435 | 0.405 | 5.529 | 1.591 | −0.636 | 5.529 |
| 0.278 | −0.465 | 5.529 | −1.409 | 0.394 | 5.529 | 1.635 | −0.646 | 5.529 |
| 0.176 | −0.436 | 5.529 | −1.377 | 0.379 | 5.529 | 1.673 | −0.654 | 5.529 |
| 0.075 | −0.404 | 5.529 | −1.337 | 0.359 | 5.529 | 1.705 | −0.661 | 5.529 |
| −0.025 | −0.370 | 5.529 | −1.289 | 0.336 | 5.529 | 1.732 | −0.667 | 5.529 |
| −0.125 | −0.334 | 5.529 | −1.239 | 0.312 | 5.529 | 1.754 | −0.672 | 5.529 |
| −0.224 | −0.296 | 5.529 | −1.182 | 0.285 | 5.529 | 1.772 | −0.676 | 5.529 |
| −0.323 | −0.255 | 5.529 | −1.119 | 0.255 | 5.529 | 1.785 | −0.679 | 5.529 |
| −0.421 | −0.213 | 5.529 | −1.049 | 0.223 | 5.529 | 1.795 | −0.682 | 5.529 |
| −0.518 | −0.169 | 5.529 | −0.976 | 0.189 | 5.529 | 1.801 | −0.689 | 5.529 |
| −0.612 | −0.124 | 5.529 | −0.900 | 0.155 | 5.529 | 1.803 | −0.695 | 5.529 |
| −0.701 | −0.080 | 5.529 | −0.820 | 0.119 | 5.529 | | | |
| −0.786 | −0.036 | 5.529 | −0.736 | 0.083 | 5.529 | | | |

The coordinate values given in TABLE 15R below provide the nominal profile envelope for an exemplary fifteenth stage rotor.

TABLE 15R

| X-LOC | Y-LOC | Z-LOC | X-LOC | Y-LOC | Z-LOC | X-LOC | Y-LOC | Z-LOC |
|---|---|---|---|---|---|---|---|---|
| 2.058 | −0.116 | 0.000 | −1.139 | −0.120 | 0.000 | −0.854 | 0.133 | 0.000 |
| 2.058 | −0.122 | 0.000 | −1.237 | −0.083 | 0.000 | −0.743 | 0.118 | 0.000 |
| 2.056 | −0.130 | 0.000 | −1.329 | −0.044 | 0.000 | −0.628 | 0.105 | 0.000 |
| 2.052 | −0.139 | 0.000 | −1.417 | −0.005 | 0.000 | −0.509 | 0.092 | 0.000 |
| 2.044 | −0.148 | 0.000 | −1.499 | 0.037 | 0.000 | −0.390 | 0.080 | 0.000 |
| 2.030 | −0.157 | 0.000 | −1.572 | 0.077 | 0.000 | −0.270 | 0.069 | 0.000 |
| 2.009 | −0.160 | 0.000 | −1.638 | 0.114 | 0.000 | −0.151 | 0.058 | 0.000 |
| 1.982 | −0.162 | 0.000 | −1.695 | 0.150 | 0.000 | −0.032 | 0.048 | 0.000 |
| 1.950 | −0.165 | 0.000 | −1.747 | 0.184 | 0.000 | 0.088 | 0.038 | 0.000 |
| 1.911 | −0.168 | 0.000 | −1.792 | 0.215 | 0.000 | 0.207 | 0.028 | 0.000 |
| 1.866 | −0.172 | 0.000 | −1.825 | 0.240 | 0.000 | 0.327 | 0.019 | 0.000 |
| 1.813 | −0.177 | 0.000 | −1.850 | 0.262 | 0.000 | 0.446 | 0.010 | 0.000 |
| 1.752 | −0.183 | 0.000 | −1.867 | 0.281 | 0.000 | 0.566 | 0.002 | 0.000 |
| 1.682 | −0.189 | 0.000 | −1.877 | 0.297 | 0.000 | 0.685 | −0.006 | 0.000 |
| 1.604 | −0.196 | 0.000 | −1.880 | 0.307 | 0.000 | 0.805 | −0.014 | 0.000 |
| 1.518 | −0.203 | 0.000 | −1.880 | 0.314 | 0.000 | 0.921 | −0.021 | 0.000 |
| 1.424 | −0.211 | 0.000 | −1.879 | 0.317 | 0.000 | 1.032 | −0.027 | 0.000 |
| 1.326 | −0.220 | 0.000 | −1.879 | 0.319 | 0.000 | 1.140 | −0.033 | 0.000 |
| 1.224 | −0.229 | 0.000 | −1.878 | 0.319 | 0.000 | 1.244 | −0.038 | 0.000 |
| 1.117 | −0.238 | 0.000 | −1.878 | 0.320 | 0.000 | 1.344 | −0.043 | 0.000 |
| 1.006 | −0.247 | 0.000 | −1.877 | 0.322 | 0.000 | 1.439 | −0.048 | 0.000 |
| 0.892 | −0.256 | 0.000 | −1.875 | 0.324 | 0.000 | 1.531 | −0.052 | 0.000 |
| 0.773 | −0.265 | 0.000 | −1.870 | 0.328 | 0.000 | 1.615 | −0.056 | 0.000 |
| 0.650 | −0.274 | 0.000 | −1.860 | 0.332 | 0.000 | 1.691 | −0.059 | 0.000 |
| 0.527 | −0.283 | 0.000 | −1.843 | 0.334 | 0.000 | 1.759 | −0.062 | 0.000 |
| 0.404 | −0.290 | 0.000 | −1.819 | 0.334 | 0.000 | 1.819 | −0.065 | 0.000 |

TABLE 15R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.282 | −0.296 | 0.000 | −1.787 | 0.329 | 0.000 | 1.870 | −0.067 | 0.000 |
| 0.159 | −0.299 | 0.000 | −1.748 | 0.321 | 0.000 | 1.914 | −0.069 | 0.000 |
| 0.036 | −0.300 | 0.000 | −1.698 | 0.308 | 0.000 | 1.952 | −0.071 | 0.000 |
| −0.086 | −0.299 | 0.000 | −1.639 | 0.294 | 0.000 | 1.983 | −0.072 | 0.000 |
| −0.209 | −0.294 | 0.000 | −1.577 | 0.278 | 0.000 | 2.009 | −0.073 | 0.000 |
| −0.331 | −0.286 | 0.000 | −1.508 | 0.261 | 0.000 | 2.030 | −0.076 | 0.000 |
| −0.453 | −0.274 | 0.000 | −1.430 | 0.243 | 0.000 | 2.043 | −0.084 | 0.000 |
| −0.575 | −0.259 | 0.000 | −1.344 | 0.223 | 0.000 | 2.051 | −0.093 | 0.000 |
| −0.697 | −0.239 | 0.000 | −1.255 | 0.203 | 0.000 | 2.056 | −0.102 | 0.000 |
| −0.815 | −0.215 | 0.000 | −1.161 | 0.184 | 0.000 | 2.058 | −0.110 | 0.000 |
| −0.928 | −0.187 | 0.000 | −1.063 | 0.166 | 0.000 | | | |
| −1.036 | −0.155 | 0.000 | −0.961 | 0.149 | 0.000 | | | |
| 2.061 | −0.152 | 0.679 | −1.197 | −0.028 | 0.679 | −0.914 | 0.191 | 0.679 |
| 2.061 | −0.158 | 0.679 | −1.297 | 0.004 | 0.679 | −0.801 | 0.174 | 0.679 |
| 2.058 | −0.166 | 0.679 | −1.391 | 0.039 | 0.679 | −0.683 | 0.158 | 0.679 |
| 2.053 | −0.175 | 0.679 | −1.481 | 0.073 | 0.679 | −0.561 | 0.142 | 0.679 |
| 2.045 | −0.184 | 0.679 | −1.566 | 0.109 | 0.679 | −0.440 | 0.126 | 0.679 |
| 2.030 | −0.191 | 0.679 | −1.643 | 0.144 | 0.679 | −0.318 | 0.112 | 0.679 |
| 2.008 | −0.193 | 0.679 | −1.711 | 0.177 | 0.679 | −0.196 | 0.098 | 0.679 |
| 1.981 | −0.193 | 0.679 | −1.770 | 0.208 | 0.679 | −0.074 | 0.084 | 0.679 |
| 1.948 | −0.194 | 0.679 | −1.825 | 0.239 | 0.679 | 0.048 | 0.071 | 0.679 |
| 1.909 | −0.194 | 0.679 | −1.872 | 0.266 | 0.679 | 0.170 | 0.058 | 0.679 |
| 1.863 | −0.195 | 0.679 | −1.907 | 0.289 | 0.679 | 0.292 | 0.046 | 0.679 |
| 1.809 | −0.196 | 0.679 | −1.934 | 0.309 | 0.679 | 0.415 | 0.034 | 0.679 |
| 1.746 | −0.197 | 0.679 | −1.952 | 0.327 | 0.679 | 0.537 | 0.022 | 0.679 |
| 1.675 | −0.199 | 0.679 | −1.963 | 0.342 | 0.679 | 0.659 | 0.009 | 0.679 |
| 1.596 | −0.200 | 0.679 | −1.967 | 0.352 | 0.679 | 0.781 | −0.003 | 0.679 |
| 1.508 | −0.201 | 0.679 | −1.968 | 0.358 | 0.679 | 0.899 | −0.014 | 0.679 |
| 1.412 | −0.203 | 0.679 | −1.968 | 0.362 | 0.679 | 1.013 | −0.024 | 0.679 |
| 1.312 | −0.205 | 0.679 | −1.967 | 0.363 | 0.679 | 1.123 | −0.033 | 0.679 |
| 1.208 | −0.206 | 0.679 | −1.967 | 0.364 | 0.679 | 1.229 | −0.042 | 0.679 |
| 1.099 | −0.208 | 0.679 | −1.966 | 0.365 | 0.679 | 1.331 | −0.051 | 0.679 |
| 0.987 | −0.210 | 0.679 | −1.966 | 0.366 | 0.679 | 1.429 | −0.059 | 0.679 |
| 0.870 | −0.212 | 0.679 | −1.964 | 0.369 | 0.679 | 1.523 | −0.067 | 0.679 |
| 0.749 | −0.214 | 0.679 | −1.959 | 0.373 | 0.679 | 1.609 | −0.074 | 0.679 |
| 0.624 | −0.216 | 0.679 | −1.949 | 0.377 | 0.679 | 1.686 | −0.081 | 0.679 |
| 0.499 | −0.218 | 0.679 | −1.931 | 0.380 | 0.679 | 1.755 | −0.086 | 0.679 |
| 0.374 | −0.218 | 0.679 | −1.906 | 0.380 | 0.679 | 1.817 | −0.092 | 0.679 |
| 0.248 | −0.217 | 0.679 | −1.874 | 0.377 | 0.679 | 1.870 | −0.096 | 0.679 |
| 0.123 | −0.215 | 0.679 | −1.833 | 0.370 | 0.679 | 1.914 | −0.100 | 0.679 |
| −0.002 | −0.211 | 0.679 | −1.781 | 0.359 | 0.679 | 1.953 | −0.103 | 0.679 |
| −0.126 | −0.205 | 0.679 | −1.721 | 0.347 | 0.679 | 1.985 | −0.106 | 0.679 |
| −0.251 | −0.197 | 0.679 | −1.657 | 0.334 | 0.679 | 2.012 | −0.108 | 0.679 |
| −0.376 | −0.187 | 0.679 | −1.585 | 0.318 | 0.679 | 2.033 | −0.111 | 0.679 |
| −0.501 | −0.173 | 0.679 | −1.505 | 0.301 | 0.679 | 2.047 | −0.119 | 0.679 |
| −0.625 | −0.157 | 0.679 | −1.417 | 0.282 | 0.679 | 2.055 | −0.128 | 0.679 |
| −0.750 | −0.137 | 0.679 | −1.325 | 0.264 | 0.679 | 2.059 | −0.138 | 0.679 |
| −0.869 | −0.114 | 0.679 | −1.228 | 0.245 | 0.679 | 2.061 | −0.146 | 0.679 |
| −0.983 | −0.088 | 0.679 | −1.128 | 0.227 | 0.679 | | | |
| −1.093 | −0.059 | 0.679 | −1.023 | 0.209 | 0.679 | | | |
| 2.078 | −0.286 | 1.359 | −1.182 | 0.018 | 1.359 | −0.904 | 0.193 | 1.359 |
| 2.077 | −0.293 | 1.359 | −1.281 | 0.050 | 1.359 | −0.790 | 0.173 | 1.359 |
| 2.075 | −0.301 | 1.359 | −1.375 | 0.083 | 1.359 | −0.673 | 0.152 | 1.359 |
| 2.069 | −0.309 | 1.359 | −1.466 | 0.116 | 1.359 | −0.551 | 0.131 | 1.359 |
| 2.059 | −0.317 | 1.359 | −1.551 | 0.151 | 1.359 | −0.428 | 0.111 | 1.359 |
| 2.044 | −0.323 | 1.359 | −1.628 | 0.183 | 1.359 | −0.306 | 0.091 | 1.359 |
| 2.022 | −0.323 | 1.359 | −1.698 | 0.215 | 1.359 | −0.184 | 0.072 | 1.359 |
| 1.995 | −0.321 | 1.359 | −1.758 | 0.244 | 1.359 | −0.061 | 0.053 | 1.359 |
| 1.962 | −0.319 | 1.359 | −1.815 | 0.273 | 1.359 | 0.061 | 0.034 | 1.359 |
| 1.922 | −0.317 | 1.359 | −1.863 | 0.299 | 1.359 | 0.183 | 0.015 | 1.359 |
| 1.876 | −0.315 | 1.359 | −1.899 | 0.321 | 1.359 | 0.306 | −0.003 | 1.359 |
| 1.822 | −0.312 | 1.359 | −1.927 | 0.340 | 1.359 | 0.428 | −0.022 | 1.359 |
| 1.759 | −0.308 | 1.359 | −1.946 | 0.356 | 1.359 | 0.551 | −0.039 | 1.359 |
| 1.688 | −0.305 | 1.359 | −1.958 | 0.371 | 1.359 | 0.674 | −0.057 | 1.359 |
| 1.609 | −0.301 | 1.359 | −1.963 | 0.380 | 1.359 | 0.796 | −0.074 | 1.359 |
| 1.521 | −0.296 | 1.359 | −1.964 | 0.387 | 1.359 | 0.915 | −0.091 | 1.359 |
| 1.424 | −0.291 | 1.359 | −1.964 | 0.390 | 1.359 | 1.029 | −0.107 | 1.359 |
| 1.324 | −0.286 | 1.359 | −1.964 | 0.392 | 1.359 | 1.140 | −0.122 | 1.359 |
| 1.219 | −0.280 | 1.359 | −1.963 | 0.393 | 1.359 | 1.246 | −0.136 | 1.359 |
| 1.111 | −0.275 | 1.359 | −1.963 | 0.393 | 1.359 | 1.348 | −0.150 | 1.359 |
| 0.998 | −0.269 | 1.359 | −1.962 | 0.395 | 1.359 | 1.447 | −0.163 | 1.359 |
| 0.880 | −0.263 | 1.359 | −1.960 | 0.397 | 1.359 | 1.541 | −0.175 | 1.359 |
| 0.759 | −0.256 | 1.359 | −1.955 | 0.401 | 1.359 | 1.627 | −0.187 | 1.359 |
| 0.634 | −0.249 | 1.359 | −1.945 | 0.405 | 1.359 | 1.704 | −0.197 | 1.359 |
| 0.508 | −0.242 | 1.359 | −1.926 | 0.407 | 1.359 | 1.774 | −0.206 | 1.359 |
| 0.383 | −0.233 | 1.359 | −1.901 | 0.406 | 1.359 | 1.835 | −0.215 | 1.359 |
| 0.257 | −0.224 | 1.359 | −1.869 | 0.402 | 1.359 | 1.888 | −0.222 | 1.359 |

TABLE 15R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.132 | −0.214 | 1.359 | −1.828 | 0.393 | 1.359 | 1.933 | −0.228 | 1.359 |
| 0.007 | −0.203 | 1.359 | −1.776 | 0.382 | 1.359 | 1.972 | −0.233 | 1.359 |
| −0.118 | −0.190 | 1.359 | −1.715 | 0.368 | 1.359 | 2.004 | −0.237 | 1.359 |
| −0.243 | −0.174 | 1.359 | −1.651 | 0.354 | 1.359 | 2.031 | −0.241 | 1.359 |
| −0.368 | −0.157 | 1.359 | −1.579 | 0.337 | 1.359 | 2.052 | −0.244 | 1.359 |
| −0.492 | −0.138 | 1.359 | −1.498 | 0.318 | 1.359 | 2.066 | −0.253 | 1.359 |
| −0.615 | −0.118 | 1.359 | −1.410 | 0.298 | 1.359 | 2.073 | −0.263 | 1.359 |
| −0.738 | −0.094 | 1.359 | −1.317 | 0.277 | 1.359 | 2.077 | −0.272 | 1.359 |
| −0.856 | −0.069 | 1.359 | −1.220 | 0.256 | 1.359 | 2.079 | −0.280 | 1.359 |
| −0.970 | −0.041 | 1.359 | −1.119 | 0.235 | 1.359 | | | |
| −1.078 | −0.012 | 1.359 | −1.014 | 0.214 | 1.359 | | | |
| 2.132 | −0.460 | 2.038 | −1.052 | 0.016 | 2.038 | −0.789 | 0.156 | 2.038 |
| 2.131 | −0.466 | 2.038 | −1.149 | 0.049 | 2.038 | −0.677 | 0.131 | 2.038 |
| 2.127 | −0.473 | 2.038 | −1.242 | 0.083 | 2.038 | −0.562 | 0.106 | 2.038 |
| 2.119 | −0.480 | 2.038 | −1.331 | 0.117 | 2.038 | −0.443 | 0.081 | 2.038 |
| 2.108 | −0.484 | 2.038 | −1.416 | 0.152 | 2.038 | −0.323 | 0.055 | 2.038 |
| 2.091 | −0.483 | 2.038 | −1.493 | 0.185 | 2.038 | −0.204 | 0.030 | 2.038 |
| 2.070 | −0.480 | 2.038 | −1.561 | 0.217 | 2.038 | −0.084 | 0.005 | 2.038 |
| 2.043 | −0.477 | 2.038 | −1.621 | 0.246 | 2.038 | 0.035 | −0.020 | 2.038 |
| 2.011 | −0.473 | 2.038 | −1.677 | 0.275 | 2.038 | 0.155 | −0.045 | 2.038 |
| 1.973 | −0.469 | 2.038 | −1.724 | 0.301 | 2.038 | 0.274 | −0.070 | 2.038 |
| 1.928 | −0.463 | 2.038 | −1.760 | 0.322 | 2.038 | 0.394 | −0.095 | 2.038 |
| 1.875 | −0.457 | 2.038 | −1.788 | 0.340 | 2.038 | 0.513 | −0.119 | 2.038 |
| 1.813 | −0.450 | 2.038 | −1.808 | 0.356 | 2.038 | 0.633 | −0.144 | 2.038 |
| 1.744 | −0.443 | 2.038 | −1.820 | 0.370 | 2.038 | 0.752 | −0.168 | 2.038 |
| 1.666 | −0.434 | 2.038 | −1.825 | 0.379 | 2.038 | 0.872 | −0.192 | 2.038 |
| 1.580 | −0.425 | 2.038 | −1.826 | 0.385 | 2.038 | 0.988 | −0.216 | 2.038 |
| 1.486 | −0.415 | 2.038 | −1.826 | 0.389 | 2.038 | 1.100 | −0.238 | 2.038 |
| 1.388 | −0.405 | 2.038 | −1.826 | 0.390 | 2.038 | 1.207 | −0.259 | 2.038 |
| 1.286 | −0.395 | 2.038 | −1.825 | 0.391 | 2.038 | 1.311 | −0.280 | 2.038 |
| 1.180 | −0.384 | 2.038 | −1.825 | 0.392 | 2.038 | 1.411 | −0.299 | 2.038 |
| 1.069 | −0.372 | 2.038 | −1.824 | 0.393 | 2.038 | 1.507 | −0.318 | 2.038 |
| 0.955 | −0.360 | 2.038 | −1.822 | 0.396 | 2.038 | 1.599 | −0.335 | 2.038 |
| 0.836 | −0.348 | 2.038 | −1.816 | 0.399 | 2.038 | 1.683 | −0.351 | 2.038 |
| 0.714 | −0.334 | 2.038 | −1.806 | 0.402 | 2.038 | 1.759 | −0.365 | 2.038 |
| 0.592 | −0.319 | 2.038 | −1.788 | 0.403 | 2.038 | 1.827 | −0.377 | 2.038 |
| 0.470 | −0.304 | 2.038 | −1.764 | 0.401 | 2.038 | 1.887 | −0.388 | 2.038 |
| 0.348 | −0.288 | 2.038 | −1.732 | 0.394 | 2.038 | 1.939 | −0.398 | 2.038 |
| 0.226 | −0.270 | 2.038 | −1.692 | 0.384 | 2.038 | 1.983 | −0.406 | 2.038 |
| 0.104 | −0.252 | 2.038 | −1.641 | 0.371 | 2.038 | 2.021 | −0.412 | 2.038 |
| −0.017 | −0.232 | 2.038 | −1.582 | 0.355 | 2.038 | 2.053 | −0.418 | 2.038 |
| −0.138 | −0.211 | 2.038 | −1.519 | 0.338 | 2.038 | 2.079 | −0.423 | 2.038 |
| −0.258 | −0.188 | 2.038 | −1.449 | 0.319 | 2.038 | 2.099 | −0.426 | 2.038 |
| −0.378 | −0.163 | 2.038 | −1.370 | 0.298 | 2.038 | 2.115 | −0.430 | 2.038 |
| −0.498 | −0.137 | 2.038 | −1.283 | 0.275 | 2.038 | 2.125 | −0.437 | 2.038 |
| −0.618 | −0.108 | 2.038 | −1.193 | 0.252 | 2.038 | 2.131 | −0.446 | 2.038 |
| −0.733 | −0.079 | 2.038 | −1.098 | 0.228 | 2.038 | 2.133 | −0.454 | 2.038 |
| −0.843 | −0.048 | 2.038 | −0.999 | 0.204 | 2.038 | | | |
| −0.950 | −0.017 | 2.038 | −0.896 | 0.180 | 2.038 | | | |
| 2.144 | −0.615 | 2.718 | −0.970 | 0.000 | 2.718 | −0.707 | 0.110 | 2.718 |
| 2.142 | −0.621 | 2.718 | −1.065 | 0.037 | 2.718 | −0.598 | 0.080 | 2.718 |
| 2.137 | −0.628 | 2.718 | −1.155 | 0.074 | 2.718 | −0.486 | 0.051 | 2.718 |
| 2.128 | −0.632 | 2.718 | −1.241 | 0.111 | 2.718 | −0.370 | 0.021 | 2.718 |
| 2.116 | −0.631 | 2.718 | −1.322 | 0.147 | 2.718 | −0.254 | −0.010 | 2.718 |
| 2.100 | −0.629 | 2.718 | −1.395 | 0.182 | 2.718 | −0.137 | −0.040 | 2.718 |
| 2.079 | −0.626 | 2.718 | −1.461 | 0.214 | 2.718 | −0.021 | −0.069 | 2.718 |
| 2.053 | −0.622 | 2.718 | −1.518 | 0.244 | 2.718 | 0.096 | −0.099 | 2.718 |
| 2.022 | −0.618 | 2.718 | −1.572 | 0.273 | 2.718 | 0.212 | −0.129 | 2.718 |
| 1.984 | −0.612 | 2.718 | −1.617 | 0.299 | 2.718 | 0.328 | −0.160 | 2.718 |
| 1.940 | −0.606 | 2.718 | −1.652 | 0.320 | 2.718 | 0.445 | −0.190 | 2.718 |
| 1.888 | −0.599 | 2.718 | −1.679 | 0.338 | 2.718 | 0.561 | −0.220 | 2.718 |
| 1.828 | −0.590 | 2.718 | −1.698 | 0.353 | 2.718 | 0.677 | −0.249 | 2.718 |
| 1.760 | −0.581 | 2.718 | −1.711 | 0.366 | 2.718 | 0.794 | −0.279 | 2.718 |
| 1.684 | −0.570 | 2.718 | −1.715 | 0.375 | 2.718 | 0.910 | −0.309 | 2.718 |
| 1.600 | −0.558 | 2.718 | −1.717 | 0.382 | 2.718 | 1.023 | −0.337 | 2.718 |
| 1.508 | −0.546 | 2.718 | −1.716 | 0.385 | 2.718 | 1.132 | −0.364 | 2.718 |
| 1.412 | −0.532 | 2.718 | −1.716 | 0.386 | 2.718 | 1.237 | −0.390 | 2.718 |
| 1.312 | −0.518 | 2.718 | −1.716 | 0.387 | 2.718 | 1.338 | −0.415 | 2.718 |
| 1.207 | −0.504 | 2.718 | −1.715 | 0.388 | 2.718 | 1.435 | −0.438 | 2.718 |
| 1.099 | −0.488 | 2.718 | −1.714 | 0.389 | 2.718 | 1.529 | −0.460 | 2.718 |
| 0.988 | −0.472 | 2.718 | −1.712 | 0.392 | 2.718 | 1.619 | −0.481 | 2.718 |
| 0.872 | −0.454 | 2.718 | −1.706 | 0.395 | 2.718 | 1.701 | −0.500 | 2.718 |
| 0.752 | −0.435 | 2.718 | −1.697 | 0.397 | 2.718 | 1.775 | −0.516 | 2.718 |
| 0.633 | −0.415 | 2.718 | −1.678 | 0.397 | 2.718 | 1.841 | −0.531 | 2.718 |
| 0.513 | −0.394 | 2.718 | −1.655 | 0.393 | 2.718 | 1.900 | −0.544 | 2.718 |
| 0.394 | −0.371 | 2.718 | −1.624 | 0.384 | 2.718 | 1.951 | −0.555 | 2.718 |
| 0.276 | −0.348 | 2.718 | −1.585 | 0.373 | 2.718 | 1.994 | −0.564 | 2.718 |

TABLE 15R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.157 | −0.323 | 2.718 | −1.536 | 0.357 | 2.718 | 2.031 | −0.572 | 2.718 |
| 0.039 | −0.297 | 2.718 | −1.478 | 0.339 | 2.718 | 2.062 | −0.578 | 2.718 |
| −0.079 | −0.269 | 2.718 | −1.417 | 0.320 | 2.718 | 2.087 | −0.583 | 2.718 |
| −0.197 | −0.240 | 2.718 | −1.348 | 0.298 | 2.718 | 2.108 | −0.587 | 2.718 |
| −0.314 | −0.209 | 2.718 | −1.272 | 0.274 | 2.718 | 2.123 | −0.591 | 2.718 |
| −0.431 | −0.176 | 2.718 | −1.188 | 0.248 | 2.718 | 2.135 | −0.594 | 2.718 |
| −0.548 | −0.142 | 2.718 | −1.100 | 0.221 | 2.718 | 2.142 | −0.602 | 2.718 |
| −0.660 | −0.107 | 2.718 | −1.008 | 0.194 | 2.718 | 2.144 | −0.609 | 2.718 |
| −0.768 | −0.072 | 2.718 | −0.911 | 0.166 | 2.718 | | | |
| −0.871 | −0.036 | 2.718 | −0.811 | 0.138 | 2.718 | | | |
| 2.147 | −0.650 | 3.057 | −0.941 | −0.024 | 3.057 | −0.682 | 0.076 | 3.057 |
| 2.145 | −0.656 | 3.057 | −1.035 | 0.014 | 3.057 | −0.574 | 0.046 | 3.057 |
| 2.140 | −0.662 | 3.057 | −1.124 | 0.051 | 3.057 | −0.463 | 0.015 | 3.057 |
| 2.131 | −0.666 | 3.057 | −1.208 | 0.089 | 3.057 | −0.348 | −0.016 | 3.057 |
| 2.119 | −0.666 | 3.057 | −1.289 | 0.126 | 3.057 | −0.233 | −0.047 | 3.057 |
| 2.103 | −0.664 | 3.057 | −1.361 | 0.161 | 3.057 | −0.118 | −0.078 | 3.057 |
| 2.082 | −0.661 | 3.057 | −1.426 | 0.193 | 3.057 | −0.002 | −0.108 | 3.057 |
| 2.056 | −0.657 | 3.057 | −1.483 | 0.224 | 3.057 | 0.113 | −0.138 | 3.057 |
| 2.025 | −0.653 | 3.057 | −1.536 | 0.253 | 3.057 | 0.228 | −0.169 | 3.057 |
| 1.987 | −0.648 | 3.057 | −1.581 | 0.279 | 3.057 | 0.344 | −0.199 | 3.057 |
| 1.943 | −0.642 | 3.057 | −1.616 | 0.300 | 3.057 | 0.459 | −0.229 | 3.057 |
| 1.892 | −0.636 | 3.057 | −1.643 | 0.317 | 3.057 | 0.575 | −0.259 | 3.057 |
| 1.832 | −0.628 | 3.057 | −1.662 | 0.332 | 3.057 | 0.690 | −0.289 | 3.057 |
| 1.764 | −0.619 | 3.057 | −1.674 | 0.345 | 3.057 | 0.806 | −0.319 | 3.057 |
| 1.689 | −0.608 | 3.057 | −1.679 | 0.354 | 3.057 | 0.921 | −0.349 | 3.057 |
| 1.605 | −0.597 | 3.057 | −1.681 | 0.360 | 3.057 | 1.033 | −0.377 | 3.057 |
| 1.514 | −0.585 | 3.057 | −1.680 | 0.364 | 3.057 | 1.141 | −0.404 | 3.057 |
| 1.418 | −0.572 | 3.057 | −1.680 | 0.365 | 3.057 | 1.245 | −0.430 | 3.057 |
| 1.319 | −0.558 | 3.057 | −1.680 | 0.366 | 3.057 | 1.345 | −0.455 | 3.057 |
| 1.216 | −0.544 | 3.057 | −1.679 | 0.367 | 3.057 | 1.442 | −0.478 | 3.057 |
| 1.108 | −0.529 | 3.057 | −1.678 | 0.368 | 3.057 | 1.535 | −0.500 | 3.057 |
| 0.997 | −0.512 | 3.057 | −1.676 | 0.370 | 3.057 | 1.624 | −0.520 | 3.057 |
| 0.882 | −0.494 | 3.057 | −1.670 | 0.373 | 3.057 | 1.706 | −0.538 | 3.057 |
| 0.764 | −0.475 | 3.057 | −1.660 | 0.375 | 3.057 | 1.779 | −0.555 | 3.057 |
| 0.645 | −0.454 | 3.057 | −1.643 | 0.374 | 3.057 | 1.845 | −0.569 | 3.057 |
| 0.527 | −0.433 | 3.057 | −1.619 | 0.370 | 3.057 | 1.904 | −0.581 | 3.057 |
| 0.409 | −0.410 | 3.057 | −1.588 | 0.361 | 3.057 | 1.954 | −0.592 | 3.057 |
| 0.291 | −0.386 | 3.057 | −1.551 | 0.349 | 3.057 | 1.997 | −0.601 | 3.057 |
| 0.174 | −0.360 | 3.057 | −1.501 | 0.333 | 3.057 | 2.034 | −0.608 | 3.057 |
| 0.057 | −0.333 | 3.057 | −1.445 | 0.314 | 3.057 | 2.065 | −0.614 | 3.057 |
| −0.060 | −0.304 | 3.057 | −1.384 | 0.294 | 3.057 | 2.090 | −0.619 | 3.057 |
| −0.177 | −0.274 | 3.057 | −1.316 | 0.272 | 3.057 | 2.110 | −0.623 | 3.057 |
| −0.293 | −0.241 | 3.057 | −1.241 | 0.247 | 3.057 | 2.126 | −0.626 | 3.057 |
| −0.408 | −0.207 | 3.057 | −1.157 | 0.220 | 3.057 | 2.137 | −0.630 | 3.057 |
| −0.524 | −0.171 | 3.057 | −1.070 | 0.192 | 3.057 | 2.144 | −0.637 | 3.057 |
| −0.635 | −0.135 | 3.057 | −0.979 | 0.164 | 3.057 | 2.147 | −0.644 | 3.057 |
| −0.741 | −0.098 | 3.057 | −0.884 | 0.135 | 3.057 | | | |
| −0.843 | −0.061 | 3.057 | −0.785 | 0.106 | 3.057 | | | |
| 2.159 | −0.651 | 3.737 | −0.891 | −0.062 | 3.737 | −0.639 | 0.034 | 3.737 |
| 2.157 | −0.656 | 3.737 | −0.983 | −0.025 | 3.737 | −0.534 | 0.004 | 3.737 |
| 2.152 | −0.663 | 3.737 | −1.071 | 0.012 | 3.737 | −0.424 | −0.026 | 3.737 |
| 2.143 | −0.667 | 3.737 | −1.155 | 0.048 | 3.737 | −0.310 | −0.056 | 3.737 |
| 2.131 | −0.667 | 3.737 | −1.235 | 0.084 | 3.737 | −0.196 | −0.086 | 3.737 |
| 2.116 | −0.665 | 3.737 | −1.307 | 0.118 | 3.737 | −0.083 | −0.116 | 3.737 |
| 2.095 | −0.662 | 3.737 | −1.371 | 0.150 | 3.737 | 0.031 | −0.145 | 3.737 |
| 2.069 | −0.660 | 3.737 | −1.428 | 0.179 | 3.737 | 0.146 | −0.173 | 3.737 |
| 2.038 | −0.656 | 3.737 | −1.480 | 0.207 | 3.737 | 0.260 | −0.202 | 3.737 |
| 2.001 | −0.652 | 3.737 | −1.525 | 0.232 | 3.737 | 0.374 | −0.230 | 3.737 |
| 1.958 | −0.647 | 3.737 | −1.560 | 0.252 | 3.737 | 0.488 | −0.259 | 3.737 |
| 1.907 | −0.641 | 3.737 | −1.587 | 0.269 | 3.737 | 0.602 | −0.287 | 3.737 |
| 1.848 | −0.635 | 3.737 | −1.606 | 0.283 | 3.737 | 0.716 | −0.315 | 3.737 |
| 1.781 | −0.627 | 3.737 | −1.619 | 0.295 | 3.737 | 0.831 | −0.343 | 3.737 |
| 1.706 | −0.618 | 3.737 | −1.624 | 0.303 | 3.737 | 0.945 | −0.371 | 3.737 |
| 1.623 | −0.609 | 3.737 | −1.626 | 0.309 | 3.737 | 1.056 | −0.398 | 3.737 |
| 1.533 | −0.598 | 3.737 | −1.626 | 0.313 | 3.737 | 1.162 | −0.423 | 3.737 |
| 1.439 | −0.587 | 3.737 | −1.626 | 0.314 | 3.737 | 1.266 | −0.448 | 3.737 |
| 1.340 | −0.575 | 3.737 | −1.626 | 0.315 | 3.737 | 1.365 | −0.471 | 3.737 |
| 1.238 | −0.563 | 3.737 | −1.625 | 0.316 | 3.737 | 1.461 | −0.492 | 3.737 |
| 1.132 | −0.549 | 3.737 | −1.624 | 0.317 | 3.737 | 1.552 | −0.512 | 3.737 |
| 1.022 | −0.534 | 3.737 | −1.622 | 0.319 | 3.737 | 1.641 | −0.531 | 3.737 |
| 0.909 | −0.518 | 3.737 | −1.616 | 0.322 | 3.737 | 1.721 | −0.548 | 3.737 |
| 0.791 | −0.500 | 3.737 | −1.606 | 0.323 | 3.737 | 1.794 | −0.563 | 3.737 |
| 0.674 | −0.481 | 3.737 | −1.589 | 0.322 | 3.737 | 1.860 | −0.576 | 3.737 |
| 0.558 | −0.461 | 3.737 | −1.566 | 0.318 | 3.737 | 1.918 | −0.587 | 3.737 |
| 0.441 | −0.440 | 3.737 | −1.535 | 0.309 | 3.737 | 1.968 | −0.596 | 3.737 |
| 0.325 | −0.417 | 3.737 | −1.498 | 0.298 | 3.737 | 2.010 | −0.604 | 3.737 |
| 0.209 | −0.392 | 3.737 | −1.449 | 0.283 | 3.737 | 2.046 | −0.611 | 3.737 |

TABLE 15R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.094 | −0.366 | 3.737 | −1.393 | 0.265 | 3.737 | 2.077 | −0.617 | 3.737 |
| −0.021 | −0.337 | 3.737 | −1.333 | 0.246 | 3.737 | 2.102 | −0.621 | 3.737 |
| −0.136 | −0.307 | 3.737 | −1.266 | 0.224 | 3.737 | 2.122 | −0.625 | 3.737 |
| −0.250 | −0.275 | 3.737 | −1.191 | 0.200 | 3.737 | 2.137 | −0.627 | 3.737 |
| −0.364 | −0.242 | 3.737 | −1.109 | 0.174 | 3.737 | 2.149 | −0.630 | 3.737 |
| −0.478 | −0.206 | 3.737 | −1.023 | 0.147 | 3.737 | 2.156 | −0.637 | 3.737 |
| −0.588 | −0.171 | 3.737 | −0.933 | 0.119 | 3.737 | 2.159 | −0.645 | 3.737 |
| −0.693 | −0.135 | 3.737 | −0.839 | 0.091 | 3.737 | | | |
| −0.794 | −0.098 | 3.737 | −0.741 | 0.063 | 3.737 | | | |
| 2.161 | −0.636 | 4.076 | −0.874 | −0.073 | 4.076 | −0.626 | 0.023 | 4.076 |
| 2.159 | −0.642 | 4.076 | −0.966 | −0.038 | 4.076 | −0.521 | −0.006 | 4.076 |
| 2.154 | −0.648 | 4.076 | −1.054 | −0.002 | 4.076 | −0.411 | −0.035 | 4.076 |
| 2.145 | −0.653 | 4.076 | −1.138 | 0.033 | 4.076 | −0.298 | −0.064 | 4.076 |
| 2.134 | −0.652 | 4.076 | −1.217 | 0.068 | 4.076 | −0.185 | −0.093 | 4.076 |
| 2.118 | −0.651 | 4.076 | −1.289 | 0.101 | 4.076 | −0.071 | −0.122 | 4.076 |
| 2.098 | −0.649 | 4.076 | −1.354 | 0.131 | 4.076 | 0.042 | −0.150 | 4.076 |
| 2.072 | −0.646 | 4.076 | −1.410 | 0.159 | 4.076 | 0.156 | −0.177 | 4.076 |
| 2.041 | −0.643 | 4.076 | −1.463 | 0.186 | 4.076 | 0.269 | −0.205 | 4.076 |
| 2.004 | −0.640 | 4.076 | −1.508 | 0.211 | 4.076 | 0.383 | −0.232 | 4.076 |
| 1.961 | −0.635 | 4.076 | −1.543 | 0.230 | 4.076 | 0.497 | −0.260 | 4.076 |
| 1.910 | −0.630 | 4.076 | −1.570 | 0.246 | 4.076 | 0.611 | −0.287 | 4.076 |
| 1.851 | −0.624 | 4.076 | −1.590 | 0.260 | 4.076 | 0.724 | −0.315 | 4.076 |
| 1.785 | −0.617 | 4.076 | −1.603 | 0.272 | 4.076 | 0.838 | −0.342 | 4.076 |
| 1.710 | −0.609 | 4.076 | −1.608 | 0.280 | 4.076 | 0.952 | −0.369 | 4.076 |
| 1.628 | −0.601 | 4.076 | −1.610 | 0.286 | 4.076 | 1.062 | −0.394 | 4.076 |
| 1.538 | −0.591 | 4.076 | −1.610 | 0.289 | 4.076 | 1.168 | −0.419 | 4.076 |
| 1.444 | −0.581 | 4.076 | −1.610 | 0.291 | 4.076 | 1.271 | −0.442 | 4.076 |
| 1.346 | −0.570 | 4.076 | −1.610 | 0.292 | 4.076 | 1.370 | −0.464 | 4.076 |
| 1.244 | −0.558 | 4.076 | −1.609 | 0.292 | 4.076 | 1.465 | −0.485 | 4.076 |
| 1.139 | −0.545 | 4.076 | −1.608 | 0.294 | 4.076 | 1.557 | −0.504 | 4.076 |
| 1.029 | −0.531 | 4.076 | −1.606 | 0.296 | 4.076 | 1.645 | −0.522 | 4.076 |
| 0.916 | −0.516 | 4.076 | −1.600 | 0.299 | 4.076 | 1.725 | −0.538 | 4.076 |
| 0.800 | −0.499 | 4.076 | −1.591 | 0.300 | 4.076 | 1.798 | −0.552 | 4.076 |
| 0.683 | −0.481 | 4.076 | −1.573 | 0.299 | 4.076 | 1.863 | −0.564 | 4.076 |
| 0.567 | −0.462 | 4.076 | −1.550 | 0.295 | 4.076 | 1.921 | −0.575 | 4.076 |
| 0.451 | −0.441 | 4.076 | −1.520 | 0.287 | 4.076 | 1.970 | −0.584 | 4.076 |
| 0.336 | −0.419 | 4.076 | −1.482 | 0.276 | 4.076 | 2.013 | −0.591 | 4.076 |
| 0.221 | −0.395 | 4.076 | −1.434 | 0.262 | 4.076 | 2.049 | −0.598 | 4.076 |
| 0.106 | −0.369 | 4.076 | −1.378 | 0.245 | 4.076 | 2.079 | −0.603 | 4.076 |
| −0.009 | −0.341 | 4.076 | −1.318 | 0.227 | 4.076 | 2.104 | −0.607 | 4.076 |
| −0.123 | −0.312 | 4.076 | −1.251 | 0.206 | 4.076 | 2.124 | −0.611 | 4.076 |
| −0.236 | −0.281 | 4.076 | −1.176 | 0.183 | 4.076 | 2.139 | −0.613 | 4.076 |
| −0.350 | −0.248 | 4.076 | −1.094 | 0.158 | 4.076 | 2.151 | −0.616 | 4.076 |
| −0.463 | −0.214 | 4.076 | −1.008 | 0.132 | 4.076 | 2.158 | −0.623 | 4.076 |
| −0.571 | −0.179 | 4.076 | −0.919 | 0.106 | 4.076 | 2.161 | −0.630 | 4.076 |
| −0.676 | −0.144 | 4.076 | −0.825 | 0.079 | 4.076 | | | |
| −0.777 | −0.109 | 4.076 | −0.727 | 0.051 | 4.076 | | | |
| 2.160 | −0.606 | 4.586 | −0.861 | −0.073 | 4.586 | −0.614 | 0.020 | 4.586 |
| 2.158 | −0.612 | 4.586 | −0.952 | −0.038 | 4.586 | −0.509 | −0.008 | 4.586 |
| 2.154 | −0.618 | 4.586 | −1.040 | −0.004 | 4.586 | −0.401 | −0.036 | 4.586 |
| 2.145 | −0.622 | 4.586 | −1.123 | 0.031 | 4.586 | −0.288 | −0.065 | 4.586 |
| 2.133 | −0.622 | 4.586 | −1.202 | 0.065 | 4.586 | −0.175 | −0.092 | 4.586 |
| 2.118 | −0.621 | 4.586 | −1.274 | 0.097 | 4.586 | −0.062 | −0.120 | 4.586 |
| 2.098 | −0.620 | 4.586 | −1.337 | 0.126 | 4.586 | 0.051 | −0.147 | 4.586 |
| 2.072 | −0.618 | 4.586 | −1.394 | 0.154 | 4.586 | 0.164 | −0.173 | 4.586 |
| 2.041 | −0.615 | 4.586 | −1.446 | 0.180 | 4.586 | 0.277 | −0.200 | 4.586 |
| 2.005 | −0.612 | 4.586 | −1.491 | 0.204 | 4.586 | 0.390 | −0.226 | 4.586 |
| 1.962 | −0.609 | 4.586 | −1.525 | 0.223 | 4.586 | 0.503 | −0.252 | 4.586 |
| 1.911 | −0.604 | 4.586 | −1.552 | 0.239 | 4.586 | 0.617 | −0.278 | 4.586 |
| 1.853 | −0.599 | 4.586 | −1.572 | 0.252 | 4.586 | 0.730 | −0.304 | 4.586 |
| 1.787 | −0.593 | 4.586 | −1.585 | 0.264 | 4.586 | 0.843 | −0.330 | 4.586 |
| 1.712 | −0.587 | 4.586 | −1.591 | 0.272 | 4.586 | 0.957 | −0.356 | 4.586 |
| 1.631 | −0.579 | 4.586 | −1.593 | 0.278 | 4.586 | 1.066 | −0.380 | 4.586 |
| 1.541 | −0.571 | 4.586 | −1.593 | 0.281 | 4.586 | 1.172 | −0.403 | 4.586 |
| 1.448 | −0.562 | 4.586 | −1.592 | 0.283 | 4.586 | 1.274 | −0.425 | 4.586 |
| 1.351 | −0.552 | 4.586 | −1.592 | 0.283 | 4.586 | 1.373 | −0.445 | 4.586 |
| 1.249 | −0.541 | 4.586 | −1.592 | 0.284 | 4.586 | 1.468 | −0.464 | 4.586 |
| 1.144 | −0.530 | 4.586 | −1.591 | 0.285 | 4.586 | 1.559 | −0.482 | 4.586 |
| 1.036 | −0.517 | 4.586 | −1.589 | 0.287 | 4.586 | 1.647 | −0.499 | 4.586 |
| 0.923 | −0.503 | 4.586 | −1.583 | 0.290 | 4.586 | 1.727 | −0.513 | 4.586 |
| 0.807 | −0.487 | 4.586 | −1.573 | 0.291 | 4.586 | 1.799 | −0.527 | 4.586 |
| 0.691 | −0.470 | 4.586 | −1.556 | 0.290 | 4.586 | 1.864 | −0.538 | 4.586 |
| 0.575 | −0.452 | 4.586 | −1.533 | 0.286 | 4.586 | 1.921 | −0.548 | 4.586 |
| 0.460 | −0.432 | 4.586 | −1.503 | 0.278 | 4.586 | 1.971 | −0.556 | 4.586 |
| 0.344 | −0.410 | 4.586 | −1.466 | 0.267 | 4.586 | 2.013 | −0.563 | 4.586 |
| 0.229 | −0.386 | 4.586 | −1.417 | 0.253 | 4.586 | 2.049 | −0.569 | 4.586 |
| 0.115 | −0.361 | 4.586 | −1.362 | 0.236 | 4.586 | 2.079 | −0.574 | 4.586 |

TABLE 15R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.000 | −0.334 | 4.586 | −1.302 | 0.218 | 4.586 | 2.104 | −0.578 | 4.586 |
| −0.113 | −0.305 | 4.586 | −1.236 | 0.198 | 4.586 | 2.124 | −0.581 | 4.586 |
| −0.227 | −0.275 | 4.586 | −1.162 | 0.176 | 4.586 | 2.139 | −0.583 | 4.586 |
| −0.340 | −0.243 | 4.586 | −1.080 | 0.151 | 4.586 | 2.150 | −0.586 | 4.586 |
| −0.453 | −0.210 | 4.586 | −0.994 | 0.126 | 4.586 | 2.157 | −0.593 | 4.586 |
| −0.561 | −0.176 | 4.586 | −0.905 | 0.100 | 4.586 | 2.160 | −0.600 | 4.586 |
| −0.665 | −0.142 | 4.586 | −0.812 | 0.074 | 4.586 | | | |
| −0.765 | −0.107 | 4.586 | −0.715 | 0.047 | 4.586 | | | |
| 2.125 | −0.622 | 4.926 | −0.864 | −0.043 | 4.926 | −0.621 | 0.034 | 4.926 |
| 2.123 | −0.628 | 4.926 | −0.954 | −0.005 | 4.926 | −0.518 | 0.003 | 4.926 |
| 2.119 | −0.634 | 4.926 | −1.040 | 0.032 | 4.926 | −0.411 | −0.028 | 4.926 |
| 2.111 | −0.639 | 4.926 | −1.122 | 0.069 | 4.926 | −0.300 | −0.059 | 4.926 |
| 2.099 | −0.639 | 4.926 | −1.199 | 0.105 | 4.926 | −0.188 | −0.090 | 4.926 |
| 2.084 | −0.638 | 4.926 | −1.269 | 0.139 | 4.926 | −0.077 | −0.119 | 4.926 |
| 2.063 | −0.636 | 4.926 | −1.332 | 0.171 | 4.926 | 0.035 | −0.148 | 4.926 |
| 2.038 | −0.634 | 4.926 | −1.387 | 0.201 | 4.926 | 0.147 | −0.177 | 4.926 |
| 2.008 | −0.632 | 4.926 | −1.438 | 0.229 | 4.926 | 0.259 | −0.205 | 4.926 |
| 1.971 | −0.629 | 4.926 | −1.482 | 0.254 | 4.926 | 0.371 | −0.232 | 4.926 |
| 1.929 | −0.626 | 4.926 | −1.515 | 0.275 | 4.926 | 0.483 | −0.260 | 4.926 |
| 1.878 | −0.622 | 4.926 | −1.541 | 0.291 | 4.926 | 0.595 | −0.287 | 4.926 |
| 1.820 | −0.617 | 4.926 | −1.560 | 0.305 | 4.926 | 0.707 | −0.314 | 4.926 |
| 1.754 | −0.611 | 4.926 | −1.573 | 0.317 | 4.926 | 0.819 | −0.341 | 4.926 |
| 1.681 | −0.605 | 4.926 | −1.578 | 0.326 | 4.926 | 0.931 | −0.367 | 4.926 |
| 1.599 | −0.597 | 4.926 | −1.580 | 0.331 | 4.926 | 1.040 | −0.393 | 4.926 |
| 1.510 | −0.589 | 4.926 | −1.580 | 0.335 | 4.926 | 1.145 | −0.417 | 4.926 |
| 1.417 | −0.579 | 4.926 | −1.580 | 0.336 | 4.926 | 1.246 | −0.439 | 4.926 |
| 1.321 | −0.569 | 4.926 | −1.580 | 0.337 | 4.926 | 1.344 | −0.460 | 4.926 |
| 1.220 | −0.558 | 4.926 | −1.579 | 0.337 | 4.926 | 1.438 | −0.480 | 4.926 |
| 1.116 | −0.545 | 4.926 | −1.578 | 0.339 | 4.926 | 1.528 | −0.498 | 4.926 |
| 1.009 | −0.531 | 4.926 | −1.576 | 0.341 | 4.926 | 1.615 | −0.515 | 4.926 |
| 0.897 | −0.516 | 4.926 | −1.570 | 0.343 | 4.926 | 1.694 | −0.530 | 4.926 |
| 0.782 | −0.498 | 4.926 | −1.560 | 0.344 | 4.926 | 1.766 | −0.543 | 4.926 |
| 0.667 | −0.479 | 4.926 | −1.543 | 0.341 | 4.926 | 1.831 | −0.555 | 4.926 |
| 0.553 | −0.459 | 4.926 | −1.521 | 0.335 | 4.926 | 1.887 | −0.565 | 4.926 |
| 0.439 | −0.436 | 4.926 | −1.492 | 0.326 | 4.926 | 1.937 | −0.573 | 4.926 |
| 0.325 | −0.412 | 4.926 | −1.455 | 0.313 | 4.926 | 1.978 | −0.580 | 4.926 |
| 0.211 | −0.386 | 4.926 | −1.408 | 0.297 | 4.926 | 2.014 | −0.586 | 4.926 |
| 0.098 | −0.357 | 4.926 | −1.354 | 0.277 | 4.926 | 2.044 | −0.591 | 4.926 |
| −0.015 | −0.328 | 4.926 | −1.296 | 0.257 | 4.926 | 2.069 | −0.594 | 4.926 |
| −0.127 | −0.296 | 4.926 | −1.230 | 0.234 | 4.926 | 2.089 | −0.597 | 4.926 |
| −0.239 | −0.263 | 4.926 | −1.158 | 0.208 | 4.926 | 2.104 | −0.600 | 4.926 |
| −0.351 | −0.228 | 4.926 | −1.078 | 0.181 | 4.926 | 2.115 | −0.603 | 4.926 |
| −0.462 | −0.192 | 4.926 | −0.994 | 0.152 | 4.926 | 2.122 | −0.609 | 4.926 |
| −0.569 | −0.155 | 4.926 | −0.907 | 0.123 | 4.926 | 2.125 | −0.616 | 4.926 |
| −0.672 | −0.118 | 4.926 | −0.815 | 0.094 | 4.926 | | | |
| −0.770 | −0.080 | 4.926 | −0.720 | 0.064 | 4.926 | | | |
| 1.988 | −0.707 | 5.435 | −0.962 | 0.092 | 5.435 | −0.729 | 0.098 | 5.435 |
| 1.987 | −0.713 | 5.435 | −1.044 | 0.147 | 5.435 | −0.631 | 0.051 | 5.435 |
| 1.982 | −0.719 | 5.435 | −1.122 | 0.201 | 5.435 | −0.529 | 0.004 | 5.435 |
| 1.974 | −0.724 | 5.435 | −1.196 | 0.254 | 5.435 | −0.422 | −0.041 | 5.435 |
| 1.962 | −0.724 | 5.435 | −1.266 | 0.306 | 5.435 | −0.315 | −0.085 | 5.435 |
| 1.946 | −0.723 | 5.435 | −1.329 | 0.355 | 5.435 | −0.207 | −0.127 | 5.435 |
| 1.926 | −0.721 | 5.435 | −1.384 | 0.400 | 5.435 | −0.098 | −0.167 | 5.435 |
| 1.900 | −0.720 | 5.435 | −1.433 | 0.441 | 5.435 | 0.011 | −0.205 | 5.435 |
| 1.869 | −0.718 | 5.435 | −1.478 | 0.479 | 5.435 | 0.122 | −0.241 | 5.435 |
| 1.832 | −0.716 | 5.435 | −1.516 | 0.514 | 5.435 | 0.232 | −0.276 | 5.435 |
| 1.788 | −0.713 | 5.435 | −1.545 | 0.540 | 5.435 | 0.344 | −0.309 | 5.435 |
| 1.737 | −0.709 | 5.435 | −1.568 | 0.562 | 5.435 | 0.455 | −0.342 | 5.435 |
| 1.678 | −0.705 | 5.435 | −1.585 | 0.579 | 5.435 | 0.567 | −0.373 | 5.435 |
| 1.611 | −0.700 | 5.435 | −1.595 | 0.594 | 5.435 | 0.678 | −0.405 | 5.435 |
| 1.536 | −0.694 | 5.435 | −1.600 | 0.602 | 5.435 | 0.790 | −0.435 | 5.435 |
| 1.454 | −0.687 | 5.435 | −1.601 | 0.609 | 5.435 | 0.899 | −0.464 | 5.435 |
| 1.363 | −0.679 | 5.435 | −1.601 | 0.612 | 5.435 | 1.004 | −0.491 | 5.435 |
| 1.269 | −0.670 | 5.435 | −1.600 | 0.613 | 5.435 | 1.105 | −0.517 | 5.435 |
| 1.171 | −0.659 | 5.435 | −1.599 | 0.614 | 5.435 | 1.203 | −0.541 | 5.435 |
| 1.069 | −0.647 | 5.435 | −1.599 | 0.614 | 5.435 | 1.297 | −0.563 | 5.435 |
| 0.965 | −0.631 | 5.435 | −1.598 | 0.615 | 5.435 | 1.387 | −0.584 | 5.435 |
| 0.856 | −0.614 | 5.435 | −1.595 | 0.616 | 5.435 | 1.474 | −0.602 | 5.435 |
| 0.745 | −0.593 | 5.435 | −1.588 | 0.616 | 5.435 | 1.554 | −0.618 | 5.435 |
| 0.630 | −0.569 | 5.435 | −1.579 | 0.614 | 5.435 | 1.626 | −0.632 | 5.435 |
| 0.516 | −0.543 | 5.435 | −1.563 | 0.606 | 5.435 | 1.691 | −0.643 | 5.435 |
| 0.403 | −0.513 | 5.435 | −1.544 | 0.593 | 5.435 | 1.748 | −0.653 | 5.435 |
| 0.290 | −0.480 | 5.435 | −1.519 | 0.575 | 5.435 | 1.798 | −0.661 | 5.435 |
| 0.178 | −0.445 | 5.435 | −1.487 | 0.552 | 5.435 | 1.840 | −0.667 | 5.435 |
| 0.067 | −0.407 | 5.435 | −1.446 | 0.523 | 5.435 | 1.876 | −0.673 | 5.435 |
| −0.044 | −0.366 | 5.435 | −1.398 | 0.490 | 5.435 | 1.906 | −0.677 | 5.435 |
| −0.154 | −0.324 | 5.435 | −1.347 | 0.456 | 5.435 | 1.931 | −0.681 | 5.435 |

TABLE 15R-continued

| X-LOC | Y-LOC | Z-LOC | X-LOC | Y-LOC | Z-LOC | X-LOC | Y-LOC | Z-LOC |
|---|---|---|---|---|---|---|---|---|
| −0.263 | −0.278 | 5.435 | −1.289 | 0.418 | 5.435 | 1.951 | −0.684 | 5.435 |
| −0.372 | −0.230 | 5.435 | −1.224 | 0.376 | 5.435 | 1.966 | −0.686 | 5.435 |
| −0.479 | −0.180 | 5.435 | −1.151 | 0.331 | 5.435 | 1.978 | −0.688 | 5.435 |
| −0.585 | −0.126 | 5.435 | −1.075 | 0.285 | 5.435 | 1.985 | −0.694 | 5.435 |
| −0.686 | −0.072 | 5.435 | −0.995 | 0.239 | 5.435 | 1.988 | −0.701 | 5.435 |
| −0.783 | −0.017 | 5.435 | −0.911 | 0.192 | 5.435 | | | |
| −0.874 | 0.037 | 5.435 | −0.822 | 0.145 | 5.435 | | | |

The coordinate values given in TABLE 16R below provide the nominal profile envelope for an exemplary sixteenth stage rotor.

TABLE 16R

| X-LOC | Y-LOC | Z-LOC | X-LOC | Y-LOC | Z-LOC | X-LOC | Y-LOC | Z-LOC |
|---|---|---|---|---|---|---|---|---|
| 2.049 | −0.214 | 0.000 | −1.104 | −0.113 | 0.000 | −0.813 | 0.110 | 0.000 |
| 2.048 | −0.220 | 0.000 | −1.198 | −0.071 | 0.000 | −0.705 | 0.088 | 0.000 |
| 2.046 | −0.228 | 0.000 | −1.287 | −0.029 | 0.000 | −0.593 | 0.067 | 0.000 |
| 2.042 | −0.237 | 0.000 | −1.371 | 0.013 | 0.000 | −0.477 | 0.047 | 0.000 |
| 2.035 | −0.246 | 0.000 | −1.451 | 0.056 | 0.000 | −0.360 | 0.028 | 0.000 |
| 2.021 | −0.255 | 0.000 | −1.522 | 0.097 | 0.000 | −0.243 | 0.011 | 0.000 |
| 2.000 | −0.259 | 0.000 | −1.586 | 0.136 | 0.000 | −0.126 | −0.004 | 0.000 |
| 1.974 | −0.261 | 0.000 | −1.641 | 0.171 | 0.000 | −0.009 | −0.018 | 0.000 |
| 1.942 | −0.264 | 0.000 | −1.691 | 0.207 | 0.000 | 0.108 | −0.031 | 0.000 |
| 1.904 | −0.268 | 0.000 | −1.734 | 0.240 | 0.000 | 0.226 | −0.042 | 0.000 |
| 1.859 | −0.272 | 0.000 | −1.764 | 0.267 | 0.000 | 0.344 | −0.053 | 0.000 |
| 1.806 | −0.277 | 0.000 | −1.787 | 0.291 | 0.000 | 0.461 | −0.063 | 0.000 |
| 1.746 | −0.282 | 0.000 | −1.803 | 0.310 | 0.000 | 0.579 | −0.073 | 0.000 |
| 1.677 | −0.288 | 0.000 | −1.812 | 0.326 | 0.000 | 0.697 | −0.083 | 0.000 |
| 1.600 | −0.295 | 0.000 | −1.815 | 0.336 | 0.000 | 0.815 | −0.093 | 0.000 |
| 1.514 | −0.302 | 0.000 | −1.815 | 0.343 | 0.000 | 0.929 | −0.102 | 0.000 |
| 1.421 | −0.310 | 0.000 | −1.814 | 0.346 | 0.000 | 1.039 | −0.110 | 0.000 |
| 1.324 | −0.318 | 0.000 | −1.813 | 0.347 | 0.000 | 1.145 | −0.119 | 0.000 |
| 1.222 | −0.327 | 0.000 | −1.813 | 0.348 | 0.000 | 1.247 | −0.126 | 0.000 |
| 1.117 | −0.335 | 0.000 | −1.812 | 0.349 | 0.000 | 1.345 | −0.134 | 0.000 |
| 1.007 | −0.343 | 0.000 | −1.812 | 0.350 | 0.000 | 1.439 | −0.140 | 0.000 |
| 0.894 | −0.351 | 0.000 | −1.809 | 0.353 | 0.000 | 1.530 | −0.146 | 0.000 |
| 0.776 | −0.359 | 0.000 | −1.804 | 0.356 | 0.000 | 1.612 | −0.151 | 0.000 |
| 0.654 | −0.365 | 0.000 | −1.795 | 0.359 | 0.000 | 1.687 | −0.155 | 0.000 |
| 0.532 | −0.371 | 0.000 | −1.777 | 0.361 | 0.000 | 1.754 | −0.159 | 0.000 |
| 0.411 | −0.374 | 0.000 | −1.753 | 0.360 | 0.000 | 1.813 | −0.162 | 0.000 |
| 0.289 | −0.375 | 0.000 | −1.722 | 0.356 | 0.000 | 1.864 | −0.165 | 0.000 |
| 0.168 | −0.374 | 0.000 | −1.683 | 0.348 | 0.000 | 1.907 | −0.167 | 0.000 |
| 0.046 | −0.370 | 0.000 | −1.634 | 0.335 | 0.000 | 1.944 | −0.169 | 0.000 |
| −0.075 | −0.363 | 0.000 | −1.577 | 0.319 | 0.000 | 1.975 | −0.170 | 0.000 |
| −0.196 | −0.351 | 0.000 | −1.517 | 0.301 | 0.000 | 2.001 | −0.171 | 0.000 |
| −0.316 | −0.336 | 0.000 | −1.449 | 0.280 | 0.000 | 2.021 | −0.175 | 0.000 |
| −0.437 | −0.316 | 0.000 | −1.374 | 0.257 | 0.000 | 2.034 | −0.183 | 0.000 |
| −0.557 | −0.291 | 0.000 | −1.290 | 0.232 | 0.000 | 2.042 | −0.192 | 0.000 |
| −0.677 | −0.261 | 0.000 | −1.203 | 0.207 | 0.000 | 2.046 | −0.200 | 0.000 |
| −0.791 | −0.228 | 0.000 | −1.112 | 0.182 | 0.000 | 2.048 | −0.208 | 0.000 |
| −0.900 | −0.192 | 0.000 | −1.017 | 0.158 | 0.000 | | | |
| −1.005 | −0.153 | 0.000 | −0.917 | 0.134 | 0.000 | | | |
| 2.025 | −0.203 | 0.498 | −1.081 | −0.130 | 0.498 | −0.810 | 0.104 | 0.498 |
| 2.025 | −0.209 | 0.498 | −1.176 | −0.098 | 0.498 | −0.702 | 0.088 | 0.498 |
| 2.023 | −0.217 | 0.498 | −1.267 | −0.064 | 0.498 | −0.590 | 0.073 | 0.498 |
| 2.019 | −0.226 | 0.498 | −1.353 | −0.029 | 0.498 | −0.474 | 0.057 | 0.498 |
| 2.011 | −0.235 | 0.498 | −1.435 | 0.006 | 0.498 | −0.358 | 0.042 | 0.498 |
| 1.998 | −0.243 | 0.498 | −1.508 | 0.040 | 0.498 | −0.242 | 0.028 | 0.498 |
| 1.977 | −0.246 | 0.498 | −1.574 | 0.072 | 0.498 | −0.126 | 0.015 | 0.498 |
| 1.951 | −0.248 | 0.498 | −1.631 | 0.102 | 0.498 | −0.010 | 0.003 | 0.498 |
| 1.920 | −0.250 | 0.498 | −1.684 | 0.132 | 0.498 | 0.107 | −0.008 | 0.498 |
| 1.882 | −0.252 | 0.498 | −1.728 | 0.160 | 0.498 | 0.223 | −0.019 | 0.498 |
| 1.839 | −0.254 | 0.498 | −1.761 | 0.184 | 0.498 | 0.340 | −0.029 | 0.498 |
| 1.787 | −0.257 | 0.498 | −1.785 | 0.205 | 0.498 | 0.456 | −0.040 | 0.498 |
| 1.727 | −0.260 | 0.498 | −1.802 | 0.223 | 0.498 | 0.573 | −0.050 | 0.498 |
| 1.659 | −0.264 | 0.498 | −1.812 | 0.238 | 0.498 | 0.689 | −0.060 | 0.498 |
| 1.584 | −0.268 | 0.498 | −1.816 | 0.247 | 0.498 | 0.806 | −0.070 | 0.498 |
| 1.500 | −0.273 | 0.498 | −1.817 | 0.253 | 0.498 | 0.919 | −0.080 | 0.498 |
| 1.408 | −0.277 | 0.498 | −1.816 | 0.257 | 0.498 | 1.027 | −0.090 | 0.498 |
| 1.313 | −0.282 | 0.498 | −1.816 | 0.258 | 0.498 | 1.132 | −0.099 | 0.498 |
| 1.213 | −0.287 | 0.498 | −1.816 | 0.259 | 0.498 | 1.233 | −0.107 | 0.498 |

TABLE 16R-continued

| X-LOC | Y-LOC | Z-LOC | X-LOC | Y-LOC | Z-LOC | X-LOC | Y-LOC | Z-LOC |
|---|---|---|---|---|---|---|---|---|
| 1.110 | −0.292 | 0.498 | −1.815 | 0.260 | 0.498 | 1.331 | −0.115 | 0.498 |
| 1.002 | −0.297 | 0.498 | −1.814 | 0.261 | 0.498 | 1.424 | −0.122 | 0.498 |
| 0.890 | −0.301 | 0.498 | −1.813 | 0.264 | 0.498 | 1.513 | −0.129 | 0.498 |
| 0.775 | −0.306 | 0.498 | −1.808 | 0.268 | 0.498 | 1.595 | −0.135 | 0.498 |
| 0.655 | −0.310 | 0.498 | −1.799 | 0.271 | 0.498 | 1.669 | −0.140 | 0.498 |
| 0.536 | −0.313 | 0.498 | −1.781 | 0.275 | 0.498 | 1.735 | −0.144 | 0.498 |
| 0.416 | −0.315 | 0.498 | −1.758 | 0.276 | 0.498 | 1.793 | −0.148 | 0.498 |
| 0.297 | −0.316 | 0.498 | −1.727 | 0.274 | 0.498 | 1.844 | −0.152 | 0.498 |
| 0.178 | −0.315 | 0.498 | −1.688 | 0.269 | 0.498 | 1.887 | −0.155 | 0.498 |
| 0.059 | −0.312 | 0.498 | −1.638 | 0.261 | 0.498 | 1.923 | −0.157 | 0.498 |
| −0.060 | −0.308 | 0.498 | −1.580 | 0.250 | 0.498 | 1.954 | −0.159 | 0.498 |
| −0.179 | −0.300 | 0.498 | −1.519 | 0.237 | 0.498 | 1.979 | −0.160 | 0.498 |
| −0.298 | −0.290 | 0.498 | −1.451 | 0.223 | 0.498 | 1.999 | −0.164 | 0.498 |
| −0.416 | −0.277 | 0.498 | −1.374 | 0.207 | 0.498 | 2.012 | −0.172 | 0.498 |
| −0.534 | −0.261 | 0.498 | −1.290 | 0.189 | 0.498 | 2.019 | −0.181 | 0.498 |
| −0.652 | −0.241 | 0.498 | −1.202 | 0.172 | 0.498 | 2.023 | −0.190 | 0.498 |
| −0.766 | −0.217 | 0.498 | −1.110 | 0.155 | 0.498 | 2.025 | −0.198 | 0.498 |
| −0.875 | −0.190 | 0.498 | −1.014 | 0.138 | 0.498 | | | |
| −0.980 | −0.161 | 0.498 | −0.914 | 0.121 | 0.498 | | | |
| 2.007 | −0.231 | 0.995 | −1.072 | −0.113 | 0.995 | −0.805 | 0.106 | 0.995 |
| 2.007 | −0.237 | 0.995 | −1.166 | −0.084 | 0.995 | −0.698 | 0.091 | 0.995 |
| 2.004 | −0.245 | 0.995 | −1.255 | −0.055 | 0.995 | −0.587 | 0.075 | 0.995 |
| 2.000 | −0.253 | 0.995 | −1.340 | −0.024 | 0.995 | −0.472 | 0.060 | 0.995 |
| 1.992 | −0.262 | 0.995 | −1.421 | 0.007 | 0.995 | −0.357 | 0.045 | 0.995 |
| 1.978 | −0.269 | 0.995 | −1.494 | 0.037 | 0.995 | −0.241 | 0.031 | 0.995 |
| 1.958 | −0.271 | 0.995 | −1.559 | 0.066 | 0.995 | −0.126 | 0.018 | 0.995 |
| 1.932 | −0.272 | 0.995 | −1.617 | 0.093 | 0.995 | −0.010 | 0.005 | 0.995 |
| 1.901 | −0.273 | 0.995 | −1.671 | 0.120 | 0.995 | 0.105 | −0.008 | 0.995 |
| 1.863 | −0.274 | 0.995 | −1.716 | 0.146 | 0.995 | 0.221 | −0.020 | 0.995 |
| 1.820 | −0.275 | 0.995 | −1.749 | 0.168 | 0.995 | 0.336 | −0.032 | 0.995 |
| 1.768 | −0.276 | 0.995 | −1.774 | 0.187 | 0.995 | 0.452 | −0.043 | 0.995 |
| 1.709 | −0.277 | 0.995 | −1.791 | 0.204 | 0.995 | 0.567 | −0.055 | 0.995 |
| 1.642 | −0.279 | 0.995 | −1.802 | 0.218 | 0.995 | 0.683 | −0.067 | 0.995 |
| 1.567 | −0.281 | 0.995 | −1.806 | 0.227 | 0.995 | 0.798 | −0.079 | 0.995 |
| 1.483 | −0.282 | 0.995 | −1.807 | 0.234 | 0.995 | 0.910 | −0.090 | 0.995 |
| 1.392 | −0.284 | 0.995 | −1.807 | 0.237 | 0.995 | 1.018 | −0.101 | 0.995 |
| 1.297 | −0.285 | 0.995 | −1.806 | 0.238 | 0.995 | 1.122 | −0.112 | 0.995 |
| 1.198 | −0.287 | 0.995 | −1.806 | 0.239 | 0.995 | 1.222 | −0.122 | 0.995 |
| 1.096 | −0.289 | 0.995 | −1.806 | 0.240 | 0.995 | 1.318 | −0.131 | 0.995 |
| 0.989 | −0.290 | 0.995 | −1.805 | 0.241 | 0.995 | 1.411 | −0.140 | 0.995 |
| 0.878 | −0.291 | 0.995 | −1.803 | 0.244 | 0.995 | 1.500 | −0.148 | 0.995 |
| 0.763 | −0.292 | 0.995 | −1.798 | 0.248 | 0.995 | 1.581 | −0.155 | 0.995 |
| 0.644 | −0.293 | 0.995 | −1.790 | 0.252 | 0.995 | 1.654 | −0.162 | 0.995 |
| 0.526 | −0.293 | 0.995 | −1.772 | 0.256 | 0.995 | 1.720 | −0.168 | 0.995 |
| 0.407 | −0.292 | 0.995 | −1.749 | 0.258 | 0.995 | 1.777 | −0.173 | 0.995 |
| 0.288 | −0.290 | 0.995 | −1.718 | 0.257 | 0.995 | 1.828 | −0.177 | 0.995 |
| 0.169 | −0.287 | 0.995 | −1.680 | 0.253 | 0.995 | 1.870 | −0.181 | 0.995 |
| 0.051 | −0.283 | 0.995 | −1.630 | 0.246 | 0.995 | 1.906 | −0.184 | 0.995 |
| −0.068 | −0.276 | 0.995 | −1.573 | 0.236 | 0.995 | 1.937 | −0.186 | 0.995 |
| −0.186 | −0.268 | 0.995 | −1.512 | 0.225 | 0.995 | 1.962 | −0.188 | 0.995 |
| −0.304 | −0.258 | 0.995 | −1.443 | 0.212 | 0.995 | 1.981 | −0.192 | 0.995 |
| −0.421 | −0.245 | 0.995 | −1.367 | 0.198 | 0.995 | 1.994 | −0.200 | 0.995 |
| −0.538 | −0.229 | 0.995 | −1.283 | 0.183 | 0.995 | 2.001 | −0.209 | 0.995 |
| −0.654 | −0.211 | 0.995 | −1.196 | 0.167 | 0.995 | 2.005 | −0.218 | 0.995 |
| −0.765 | −0.189 | 0.995 | −1.104 | 0.152 | 0.995 | 2.007 | −0.225 | 0.995 |
| −0.872 | −0.165 | 0.995 | −1.008 | 0.136 | 0.995 | | | |
| −0.974 | −0.140 | 0.995 | −0.909 | 0.121 | 0.995 | | | |
| 2.008 | −0.306 | 1.659 | −1.043 | −0.085 | 1.659 | −0.783 | 0.099 | 1.659 |
| 2.007 | −0.311 | 1.659 | −1.136 | −0.055 | 1.659 | −0.677 | 0.081 | 1.659 |
| 2.004 | −0.319 | 1.659 | −1.224 | −0.024 | 1.659 | −0.567 | 0.063 | 1.659 |
| 1.999 | −0.327 | 1.659 | −1.309 | 0.007 | 1.659 | −0.452 | 0.045 | 1.659 |
| 1.990 | −0.334 | 1.659 | −1.389 | 0.039 | 1.659 | −0.338 | 0.028 | 1.659 |
| 1.975 | −0.339 | 1.659 | −1.462 | 0.069 | 1.659 | −0.224 | 0.011 | 1.659 |
| 1.955 | −0.338 | 1.659 | −1.527 | 0.098 | 1.659 | −0.110 | −0.005 | 1.659 |
| 1.929 | −0.338 | 1.659 | −1.584 | 0.125 | 1.659 | 0.005 | −0.021 | 1.659 |
| 1.898 | −0.338 | 1.659 | −1.636 | 0.152 | 1.659 | 0.119 | −0.036 | 1.659 |
| 1.861 | −0.337 | 1.659 | −1.681 | 0.177 | 1.659 | 0.234 | −0.051 | 1.659 |
| 1.818 | −0.337 | 1.659 | −1.714 | 0.199 | 1.659 | 0.349 | −0.065 | 1.659 |
| 1.767 | −0.336 | 1.659 | −1.739 | 0.218 | 1.659 | 0.463 | −0.080 | 1.659 |
| 1.708 | −0.335 | 1.659 | −1.757 | 0.233 | 1.659 | 0.578 | −0.095 | 1.659 |
| 1.642 | −0.334 | 1.659 | −1.768 | 0.247 | 1.659 | 0.692 | −0.109 | 1.659 |
| 1.567 | −0.333 | 1.659 | −1.773 | 0.256 | 1.659 | 0.807 | −0.124 | 1.859 |
| 1.485 | −0.331 | 1.659 | −1.774 | 0.262 | 1.659 | 0.918 | −0.139 | 1.659 |
| 1.395 | −0.329 | 1.659 | −1.774 | 0.265 | 1.659 | 1.024 | −0.152 | 1.659 |
| 1.301 | −0.328 | 1.659 | −1.774 | 0.266 | 1.659 | 1.128 | −0.166 | 1.659 |
| 1.203 | −0.326 | 1.659 | −1.773 | 0.267 | 1.659 | 1.227 | −0.178 | 1.659 |
| 1.101 | −0.323 | 1.659 | −1.773 | 0.268 | 1.659 | 1.322 | −0.190 | 1.659 |

TABLE 16R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.995 | −0.321 | 1.659 | −1.772 | 0.269 | 1.659 | 1.414 | −0.202 | 1.659 |
| 0.886 | −0.318 | 1.659 | −1.770 | 0.272 | 1.659 | 1.502 | −0.212 | 1.659 |
| 0.772 | −0.315 | 1.659 | −1.765 | 0.275 | 1.659 | 1.582 | −0.222 | 1.659 |
| 0.654 | −0.311 | 1.659 | −1.756 | 0.279 | 1.659 | 1.655 | −0.231 | 1.659 |
| 0.537 | −0.307 | 1.659 | −1.739 | 0.281 | 1.659 | 1.720 | −0.238 | 1.659 |
| 0.420 | −0.302 | 1.659 | −1.716 | 0.281 | 1.659 | 1.777 | −0.245 | 1.659 |
| 0.302 | −0.296 | 1.659 | −1.685 | 0.279 | 1.659 | 1.827 | −0.251 | 1.659 |
| 0.185 | −0.290 | 1.659 | −1.647 | 0.273 | 1.659 | 1.869 | −0.256 | 1.659 |
| 0.067 | −0.281 | 1.659 | −1.598 | 0.264 | 1.659 | 1.905 | −0.260 | 1.659 |
| −0.050 | −0.271 | 1.659 | −1.541 | 0.252 | 1.659 | 1.935 | −0.263 | 1.659 |
| −0.167 | −0.260 | 1.659 | −1.481 | 0.238 | 1.659 | 1.960 | −0.266 | 1.659 |
| −0.283 | −0.246 | 1.659 | −1.414 | 0.223 | 1.659 | 1.980 | −0.269 | 1.659 |
| −0.399 | −0.230 | 1.659 | −1.339 | 0.207 | 1.659 | 1.994 | −0.275 | 1.659 |
| −0.514 | −0.211 | 1.659 | −1.256 | 0.189 | 1.659 | 2.002 | −0.283 | 1.659 |
| −0.629 | −0.190 | 1.659 | −1.169 | 0.171 | 1.659 | 2.006 | −0.292 | 1.659 |
| −0.739 | −0.166 | 1.659 | −1.079 | 0.153 | 1.659 | 2.008 | −0.300 | 1.659 |
| −0.845 | −0.141 | 1.659 | −0.984 | 0.135 | 1.659 | | | |
| −0.946 | −0.114 | 1.659 | −0.885 | 0.117 | 1.659 | | | |
| 2.036 | −0.416 | 2.322 | −0.990 | −0.051 | 2.322 | −0.734 | 0.096 | 2.322 |
| 2.035 | −0.422 | 2.322 | −1.082 | −0.018 | 2.322 | −0.629 | 0.073 | 2.322 |
| 2.031 | −0.429 | 2.322 | −1.170 | 0.016 | 2.322 | −0.520 | 0.050 | 2.322 |
| 2.024 | −0.435 | 2.322 | −1.253 | 0.049 | 2.322 | −0.408 | 0.027 | 2.322 |
| 2.013 | −0.438 | 2.322 | −1.332 | 0.083 | 2.322 | −0.295 | 0.004 | 2.322 |
| 1.997 | −0.437 | 2.322 | −1.404 | 0.114 | 2.322 | −0.182 | −0.018 | 2.322 |
| 1.977 | −0.436 | 2.322 | −1.468 | 0.144 | 2.322 | −0.069 | −0.040 | 2.322 |
| 1.952 | −0.435 | 2.322 | −1.524 | 0.171 | 2.322 | 0.045 | −0.061 | 2.322 |
| 1.921 | −0.434 | 2.322 | −1.576 | 0.199 | 2.322 | 0.158 | −0.082 | 2.322 |
| 1.885 | −0.432 | 2.322 | −1.620 | 0.224 | 2.322 | 0.271 | −0.102 | 2.322 |
| 1.842 | −0.430 | 2.322 | −1.653 | 0.245 | 2.322 | 0.385 | −0.122 | 2.322 |
| 1.791 | −0.428 | 2.322 | −1.678 | 0.263 | 2.322 | 0.498 | −0.142 | 2.322 |
| 1.733 | −0.425 | 2.322 | −1.696 | 0.279 | 2.322 | 0.612 | −0.161 | 2.322 |
| 1.667 | −0.422 | 2.322 | −1.708 | 0.292 | 2.322 | 0.725 | −0.181 | 2.322 |
| 1.593 | −0.418 | 2.322 | −1.713 | 0.300 | 2.322 | 0.839 | −0.200 | 2.322 |
| 1.512 | −0.413 | 2.322 | −1.715 | 0.306 | 2.322 | 0.949 | −0.219 | 2.322 |
| 1.423 | −0.408 | 2.322 | −1.715 | 0.309 | 2.322 | 1.055 | −0.236 | 2.322 |
| 1.329 | −0.403 | 2.322 | −1.715 | 0.310 | 2.322 | 1.157 | −0.254 | 2.322 |
| 1.232 | −0.398 | 2.322 | −1.714 | 0.311 | 2.322 | 1.255 | −0.270 | 2.322 |
| 1.131 | −0.392 | 2.322 | −1.714 | 0.312 | 2.322 | 1.350 | −0.286 | 2.322 |
| 1.027 | −0.386 | 2.322 | −1.713 | 0.313 | 2.322 | 1.441 | −0.301 | 2.322 |
| 0.918 | −0.379 | 2.322 | −1.711 | 0.315 | 2.322 | 1.528 | −0.315 | 2.322 |
| 0.806 | −0.372 | 2.322 | −1.706 | 0.318 | 2.322 | 1.608 | −0.327 | 2.322 |
| 0.689 | −0.363 | 2.322 | −1.696 | 0.321 | 2.322 | 1.680 | −0.338 | 2.322 |
| 0.573 | −0.354 | 2.322 | −1.679 | 0.321 | 2.322 | 1.745 | −0.348 | 2.322 |
| 0.457 | −0.344 | 2.322 | −1.656 | 0.320 | 2.322 | 1.801 | −0.357 | 2.322 |
| 0.341 | −0.332 | 2.322 | −1.625 | 0.315 | 2.322 | 1.851 | −0.365 | 2.322 |
| 0.226 | −0.319 | 2.322 | −1.588 | 0.308 | 2.322 | 1.893 | −0.371 | 2.322 |
| 0.110 | −0.305 | 2.322 | −1.539 | 0.297 | 2.322 | 1.928 | −0.377 | 2.322 |
| −0.005 | −0.289 | 2.322 | −1.483 | 0.282 | 2.322 | 1.958 | −0.381 | 2.322 |
| −0.121 | −0.271 | 2.322 | −1.424 | 0.267 | 2.322 | 1.983 | −0.385 | 2.322 |
| −0.235 | −0.250 | 2.322 | −1.357 | 0.249 | 2.322 | 2.003 | −0.388 | 2.322 |
| −0.350 | −0.228 | 2.322 | −1.283 | 0.229 | 2.322 | 2.018 | −0.390 | 2.322 |
| −0.464 | −0.203 | 2.322 | −1.201 | 0.207 | 2.322 | 2.028 | −0.395 | 2.322 |
| −0.578 | −0.175 | 2.322 | −1.116 | 0.186 | 2.322 | 2.034 | −0.403 | 2.322 |
| −0.688 | −0.146 | 2.322 | −1.026 | 0.164 | 2.322 | 2.036 | −0.410 | 2.322 |
| −0.793 | −0.115 | 2.322 | −0.933 | 0.141 | 2.322 | | | |
| −0.894 | −0.083 | 2.322 | −0.836 | 0.119 | 2.322 | | | |
| 2.039 | −0.477 | 2.986 | −0.962 | −0.042 | 2.986 | −0.712 | 0.078 | 2.986 |
| 2.037 | −0.482 | 2.986 | −1.052 | −0.008 | 2.986 | −0.608 | 0.053 | 2.986 |
| 2.033 | −0.489 | 2.986 | −1.139 | 0.026 | 2.986 | −0.500 | 0.028 | 2.986 |
| 2.025 | −0.494 | 2.986 | −1.222 | 0.060 | 2.986 | −0.389 | 0.003 | 2.986 |
| 2.014 | −0.495 | 2.986 | −1.300 | 0.093 | 2.986 | −0.277 | −0.022 | 2.986 |
| 1.999 | −0.495 | 2.986 | −1.371 | 0.125 | 2.986 | −0.165 | −0.046 | 2.986 |
| 1.979 | −0.494 | 2.986 | −1.435 | 0.154 | 2.986 | −0.052 | −0.071 | 2.986 |
| 1.953 | −0.492 | 2.986 | −1.491 | 0.181 | 2.986 | 0.060 | −0.094 | 2.986 |
| 1.923 | −0.491 | 2.986 | −1.543 | 0.208 | 2.986 | 0.172 | −0.118 | 2.986 |
| 1.887 | −0.489 | 2.986 | −1.587 | 0.232 | 2.986 | 0.284 | −0.141 | 2.986 |
| 1.844 | −0.486 | 2.986 | −1.620 | 0.252 | 2.986 | 0.397 | −0.164 | 2.986 |
| 1.794 | −0.483 | 2.986 | −1.646 | 0.270 | 2.986 | 0.509 | −0.186 | 2.986 |
| 1.736 | −0.480 | 2.986 | −1.664 | 0.284 | 2.986 | 0.622 | −0.208 | 2.986 |
| 1.670 | −0.476 | 2.986 | −1.676 | 0.297 | 2.986 | 0.734 | −0.230 | 2.986 |
| 1.597 | −0.471 | 2.986 | −1.681 | 0.305 | 2.986 | 0.847 | −0.251 | 2.986 |
| 1.516 | −0.466 | 2.986 | −1.683 | 0.311 | 2.986 | 0.956 | −0.272 | 2.986 |
| 1.427 | −0.460 | 2.986 | −1.684 | 0.314 | 2.986 | 1.061 | −0.292 | 2.986 |
| 1.335 | −0.453 | 2.986 | −1.683 | 0.315 | 2.986 | 1.162 | −0.310 | 2.986 |
| 1.238 | −0.446 | 2.986 | −1.683 | 0.316 | 2.986 | 1.260 | −0.328 | 2.986 |
| 1.138 | −0.439 | 2.986 | −1.683 | 0.317 | 2.986 | 1.354 | −0.345 | 2.986 |
| 1.034 | −0.430 | 2.986 | −1.682 | 0.318 | 2.986 | 1.445 | −0.361 | 2.986 |

TABLE 16R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.926 | −0.421 | 2.986 | −1.679 | 0.320 | 2.986 | 1.531 | −0.375 | 2.986 |
| 0.815 | −0.411 | 2.986 | −1.674 | 0.323 | 2.986 | 1.610 | −0.389 | 2.986 |
| 0.699 | −0.399 | 2.986 | −1.664 | 0.324 | 2.986 | 1.682 | −0.400 | 2.986 |
| 0.584 | −0.386 | 2.986 | −1.647 | 0.325 | 2.986 | 1.746 | −0.411 | 2.986 |
| 0.469 | −0.372 | 2.986 | −1.624 | 0.322 | 2.986 | 1.803 | −0.420 | 2.986 |
| 0.354 | −0.357 | 2.986 | −1.594 | 0.317 | 2.986 | 1.852 | −0.428 | 2.986 |
| 0.240 | −0.340 | 2.986 | −1.557 | 0.308 | 2.986 | 1.894 | −0.434 | 2.986 |
| 0.125 | −0.322 | 2.986 | −1.509 | 0.295 | 2.986 | 1.929 | −0.440 | 2.986 |
| 0.011 | −0.302 | 2.986 | −1.454 | 0.280 | 2.986 | 1.959 | −0.444 | 2.986 |
| −0.103 | −0.280 | 2.986 | −1.395 | 0.262 | 2.986 | 1.983 | −0.448 | 2.986 |
| −0.216 | −0.256 | 2.986 | −1.329 | 0.243 | 2.986 | 2.003 | −0.451 | 2.986 |
| −0.330 | −0.231 | 2.986 | −1.256 | 0.222 | 2.986 | 2.018 | −0.453 | 2.986 |
| −0.443 | −0.203 | 2.986 | −1.175 | 0.199 | 2.986 | 2.029 | −0.457 | 2.986 |
| −0.555 | −0.172 | 2.986 | −1.090 | 0.176 | 2.986 | 2.036 | −0.464 | 2.986 |
| −0.663 | −0.141 | 2.986 | −1.001 | 0.152 | 2.986 | 2.038 | −0.471 | 2.986 |
| −0.767 | −0.108 | 2.986 | −0.909 | 0.128 | 2.986 | | | |
| −0.866 | −0.075 | 2.986 | −0.813 | 0.103 | 2.986 | | | |
| 2.031 | −0.470 | 3.317 | −0.950 | −0.050 | 3.317 | −0.705 | 0.059 | 3.317 |
| 2.030 | −0.476 | 3.317 | −1.040 | −0.016 | 3.317 | −0.602 | 0.034 | 3.317 |
| 2.026 | −0.482 | 3.317 | −1.126 | 0.017 | 3.317 | −0.495 | 0.008 | 3.317 |
| 2.018 | −0.487 | 3.317 | −1.208 | 0.050 | 3.317 | −0.384 | −0.017 | 3.317 |
| 2.006 | −0.488 | 3.317 | −1.286 | 0.083 | 3.317 | −0.273 | −0.041 | 3.317 |
| 1.991 | −0.488 | 3.317 | −1.357 | 0.114 | 3.317 | −0.161 | −0.066 | 3.317 |
| 1.971 | −0.487 | 3.317 | −1.420 | 0.143 | 3.317 | −0.050 | −0.089 | 3.317 |
| 1.946 | −0.486 | 3.317 | −1.476 | 0.170 | 3.317 | 0.062 | −0.112 | 3.317 |
| 1.916 | −0.485 | 3.317 | −1.527 | 0.195 | 3.317 | 0.173 | −0.135 | 3.317 |
| 1.880 | −0.483 | 3.317 | −1.572 | 0.219 | 3.317 | 0.285 | −0.157 | 3.317 |
| 1.837 | −0.481 | 3.317 | −1.605 | 0.238 | 3.317 | 0.397 | −0.179 | 3.317 |
| 1.788 | −0.479 | 3.317 | −1.630 | 0.255 | 3.317 | 0.509 | −0.200 | 3.317 |
| 1.730 | −0.476 | 3.317 | −1.648 | 0.270 | 3.317 | 0.621 | −0.221 | 3.317 |
| 1.665 | −0.473 | 3.317 | −1.661 | 0.282 | 3.317 | 0.733 | −0.242 | 3.317 |
| 1.592 | −0.469 | 3.317 | −1.666 | 0.290 | 3.317 | 0.845 | −0.262 | 3.317 |
| 1.511 | −0.464 | 3.317 | −1.669 | 0.295 | 3.317 | 0.953 | −0.281 | 3.317 |
| 1.423 | −0.459 | 3.317 | −1.669 | 0.298 | 3.317 | 1.058 | −0.299 | 3.317 |
| 1.331 | −0.454 | 3.317 | −1.668 | 0.300 | 3.317 | 1.159 | −0.316 | 3.317 |
| 1.235 | −0.448 | 3.317 | −1.668 | 0.301 | 3.317 | 1.256 | −0.333 | 3.317 |
| 1.136 | −0.441 | 3.317 | −1.668 | 0.301 | 3.317 | 1.350 | −0.348 | 3.317 |
| 1.032 | −0.434 | 3.317 | −1.667 | 0.303 | 3.317 | 1.440 | −0.363 | 3.317 |
| 0.925 | −0.425 | 3.317 | −1.665 | 0.305 | 3.317 | 1.526 | −0.376 | 3.317 |
| 0.814 | −0.416 | 3.317 | −1.659 | 0.307 | 3.317 | 1.605 | −0.388 | 3.317 |
| 0.700 | −0.405 | 3.317 | −1.649 | 0.309 | 3.317 | 1.676 | −0.399 | 3.317 |
| 0.585 | −0.393 | 3.317 | −1.632 | 0.309 | 3.317 | 1.740 | −0.409 | 3.317 |
| 0.471 | −0.379 | 3.317 | −1.610 | 0.306 | 3.317 | 1.796 | −0.417 | 3.317 |
| 0.357 | −0.364 | 3.317 | −1.580 | 0.300 | 3.317 | 1.845 | −0.424 | 3.317 |
| 0.243 | −0.348 | 3.317 | −1.543 | 0.292 | 3.317 | 1.887 | −0.430 | 3.317 |
| 0.129 | −0.330 | 3.317 | −1.495 | 0.278 | 3.317 | 1.922 | −0.435 | 3.317 |
| 0.015 | −0.310 | 3.317 | −1.441 | 0.262 | 3.317 | 1.952 | −0.439 | 3.317 |
| −0.098 | −0.288 | 3.317 | −1.383 | 0.245 | 3.317 | 1.976 | −0.443 | 3.317 |
| −0.211 | −0.264 | 3.317 | −1.317 | 0.225 | 3.317 | 1.996 | −0.445 | 3.317 |
| −0.324 | −0.239 | 3.317 | −1.244 | 0.204 | 3.317 | 2.011 | −0.447 | 3.317 |
| −0.436 | −0.210 | 3.317 | −1.164 | 0.181 | 3.317 | 2.022 | −0.451 | 3.317 |
| −0.547 | −0.180 | 3.317 | −1.080 | 0.157 | 3.317 | 2.028 | −0.457 | 3.317 |
| −0.654 | −0.148 | 3.317 | −0.992 | 0.133 | 3.317 | 2.031 | −0.464 | 3.317 |
| −0.757 | −0.116 | 3.317 | −0.900 | 0.108 | 3.317 | | | |
| −0.855 | −0.083 | 3.317 | −0.805 | 0.084 | 3.317 | | | |
| 2.012 | −0.445 | 3.981 | −0.929 | −0.076 | 3.981 | −0.694 | 0.018 | 3.981 |
| 2.011 | −0.450 | 3.981 | −1.018 | −0.044 | 3.981 | −0.592 | −0.006 | 3.981 |
| 2.007 | −0.457 | 3.981 | −1.103 | −0.013 | 3.981 | −0.486 | −0.030 | 3.981 |
| 1.999 | −0.462 | 3.981 | −1.184 | 0.019 | 3.981 | −0.377 | −0.053 | 3.981 |
| 1.987 | −0.463 | 3.981 | −1.262 | 0.050 | 3.981 | −0.267 | −0.076 | 3.981 |
| 1.972 | −0.462 | 3.981 | −1.332 | 0.080 | 3.981 | −0.157 | −0.098 | 3.981 |
| 1.953 | −0.462 | 3.981 | −1.394 | 0.107 | 3.981 | −0.047 | −0.119 | 3.981 |
| 1.928 | −0.461 | 3.981 | −1.450 | 0.132 | 3.981 | 0.063 | −0.139 | 3.981 |
| 1.898 | −0.460 | 3.981 | −1.501 | 0.156 | 3.981 | 0.174 | −0.159 | 3.981 |
| 1.863 | −0.459 | 3.981 | −1.545 | 0.177 | 3.981 | 0.284 | −0.178 | 3.981 |
| 1.821 | −0.458 | 3.981 | −1.579 | 0.195 | 3.981 | 0.395 | −0.197 | 3.981 |
| 1.772 | −0.457 | 3.981 | −1.604 | 0.211 | 3.981 | 0.506 | −0.215 | 3.981 |
| 1.715 | −0.455 | 3.981 | −1.623 | 0.225 | 3.981 | 0.616 | −0.233 | 3.981 |
| 1.651 | −0.453 | 3.981 | −1.635 | 0.236 | 3.981 | 0.727 | −0.250 | 3.981 |
| 1.579 | −0.451 | 3.981 | −1.641 | 0.244 | 3.981 | 0.838 | −0.267 | 3.981 |
| 1.500 | −0.448 | 3.981 | −1.644 | 0.249 | 3.981 | 0.945 | −0.283 | 3.981 |
| 1.413 | −0.444 | 3.981 | −1.644 | 0.252 | 3.981 | 1.049 | −0.299 | 3.981 |
| 1.322 | −0.440 | 3.981 | −1.644 | 0.254 | 3.981 | 1.149 | −0.313 | 3.981 |
| 1.228 | −0.436 | 3.981 | −1.644 | 0.254 | 3.981 | 1.245 | −0.327 | 3.981 |
| 1.129 | −0.431 | 3.981 | −1.643 | 0.255 | 3.981 | 1.338 | −0.340 | 3.981 |
| 1.028 | −0.426 | 3.981 | −1.642 | 0.256 | 3.981 | 1.427 | −0.353 | 3.981 |
| 0.922 | −0.420 | 3.981 | −1.640 | 0.258 | 3.981 | 1.512 | −0.364 | 3.981 |

TABLE 16R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.813 | −0.412 | 3.981 | −1.634 | 0.261 | 3.981 | 1.590 | −0.374 | 3.981 |
| 0.699 | −0.404 | 3.981 | −1.625 | 0.262 | 3.981 | 1.660 | −0.383 | 3.981 |
| 0.587 | −0.394 | 3.981 | −1.608 | 0.262 | 3.981 | 1.723 | −0.391 | 3.981 |
| 0.474 | −0.383 | 3.981 | −1.586 | 0.259 | 3.981 | 1.779 | −0.398 | 3.981 |
| 0.361 | −0.370 | 3.981 | −1.557 | 0.253 | 3.981 | 1.827 | −0.404 | 3.981 |
| 0.248 | −0.355 | 3.981 | −1.520 | 0.244 | 3.981 | 1.868 | −0.409 | 3.981 |
| 0.136 | −0.339 | 3.981 | −1.474 | 0.231 | 3.981 | 1.903 | −0.413 | 3.981 |
| 0.024 | −0.321 | 3.981 | −1.420 | 0.215 | 3.981 | 1.933 | −0.417 | 3.981 |
| −0.088 | −0.301 | 3.981 | −1.362 | 0.198 | 3.981 | 1.957 | −0.419 | 3.981 |
| −0.200 | −0.279 | 3.981 | −1.298 | 0.179 | 3.981 | 1.976 | −0.422 | 3.981 |
| −0.310 | −0.255 | 3.981 | −1.226 | 0.158 | 3.981 | 1.991 | −0.423 | 3.981 |
| −0.421 | −0.228 | 3.981 | −1.146 | 0.136 | 3.981 | 2.002 | −0.426 | 3.981 |
| −0.531 | −0.199 | 3.981 | −1.063 | 0.113 | 3.981 | 2.009 | −0.432 | 3.981 |
| −0.636 | −0.169 | 3.981 | −0.977 | 0.089 | 3.981 | 2.011 | −0.439 | 3.981 |
| −0.738 | −0.139 | 3.981 | −0.886 | 0.066 | 3.981 | | | |
| −0.835 | −0.107 | 3.981 | −0.792 | 0.042 | 3.981 | | | |
| 2.002 | −0.435 | 4.313 | −0.931 | −0.080 | 4.313 | −0.699 | 0.011 | 4.313 |
| 2.001 | −0.441 | 4.313 | −1.020 | −0.049 | 4.313 | −0.597 | −0.012 | 4.313 |
| 1.997 | −0.447 | 4.313 | −1.105 | −0.017 | 4.313 | −0.492 | −0.035 | 4.313 |
| 1.989 | −0.452 | 4.313 | −1.186 | 0.014 | 4.313 | −0.382 | −0.058 | 4.313 |
| 1.977 | −0.453 | 4.313 | −1.264 | 0.044 | 4.313 | −0.273 | −0.080 | 4.313 |
| 1.962 | −0.453 | 4.313 | −1.333 | 0.073 | 4.313 | −0.163 | −0.101 | 4.313 |
| 1.943 | −0.452 | 4.313 | −1.396 | 0.100 | 4.313 | −0.053 | −0.121 | 4.313 |
| 1.918 | −0.452 | 4.313 | −1.451 | 0.124 | 4.313 | 0.057 | −0.141 | 4.313 |
| 1.888 | −0.451 | 4.313 | −1.503 | 0.148 | 4.313 | 0.167 | −0.160 | 4.313 |
| 1.853 | −0.450 | 4.313 | −1.547 | 0.169 | 4.313 | 0.278 | −0.179 | 4.313 |
| 1.812 | −0.449 | 4.313 | −1.580 | 0.187 | 4.313 | 0.388 | −0.197 | 4.313 |
| 1.762 | −0.448 | 4.313 | −1.606 | 0.203 | 4.313 | 0.499 | −0.214 | 4.313 |
| 1.706 | −0.447 | 4.313 | −1.625 | 0.216 | 4.313 | 0.609 | −0.231 | 4.313 |
| 1.642 | −0.445 | 4.313 | −1.638 | 0.227 | 4.313 | 0.720 | −0.247 | 4.313 |
| 1.570 | −0.443 | 4.313 | −1.644 | 0.234 | 4.313 | 0.831 | −0.264 | 4.313 |
| 1.491 | −0.441 | 4.313 | −1.646 | 0.240 | 4.313 | 0.938 | −0.279 | 4.313 |
| 1.404 | −0.438 | 4.313 | −1.647 | 0.243 | 4.313 | 1.041 | −0.294 | 4.313 |
| 1.314 | −0.435 | 4.313 | −1.647 | 0.244 | 4.313 | 1.141 | −0.308 | 4.313 |
| 1.220 | −0.431 | 4.313 | −1.646 | 0.245 | 4.313 | 1.237 | −0.322 | 4.313 |
| 1.122 | −0.427 | 4.313 | −1.646 | 0.245 | 4.313 | 1.329 | −0.334 | 4.313 |
| 1.020 | −0.422 | 4.313 | −1.645 | 0.247 | 4.313 | 1.418 | −0.346 | 4.313 |
| 0.915 | −0.416 | 4.313 | −1.643 | 0.249 | 4.313 | 1.503 | −0.357 | 4.313 |
| 0.806 | −0.409 | 4.313 | −1.637 | 0.251 | 4.313 | 1.580 | −0.367 | 4.313 |
| 0.693 | −0.401 | 4.313 | −1.628 | 0.252 | 4.313 | 1.651 | −0.376 | 4.313 |
| 0.581 | −0.392 | 4.313 | −1.611 | 0.251 | 4.313 | 1.714 | −0.384 | 4.313 |
| 0.468 | −0.381 | 4.313 | −1.589 | 0.248 | 4.313 | 1.769 | −0.390 | 4.313 |
| 0.356 | −0.369 | 4.313 | −1.560 | 0.242 | 4.313 | 1.817 | −0.396 | 4.313 |
| 0.243 | −0.355 | 4.313 | −1.523 | 0.233 | 4.313 | 1.858 | −0.401 | 4.313 |
| 0.131 | −0.339 | 4.313 | −1.477 | 0.220 | 4.313 | 1.893 | −0.405 | 4.313 |
| 0.019 | −0.321 | 4.313 | −1.423 | 0.204 | 4.313 | 1.922 | −0.408 | 4.313 |
| −0.092 | −0.301 | 4.313 | −1.366 | 0.187 | 4.313 | 1.946 | −0.411 | 4.313 |
| −0.203 | −0.280 | 4.313 | −1.301 | 0.169 | 4.313 | 1.965 | −0.413 | 4.313 |
| −0.314 | −0.255 | 4.313 | −1.229 | 0.148 | 4.313 | 1.980 | −0.414 | 4.313 |
| −0.424 | −0.229 | 4.313 | −1.150 | 0.126 | 4.313 | 1.991 | −0.417 | 4.313 |
| −0.534 | −0.201 | 4.313 | −1.068 | 0.104 | 4.313 | 1.998 | −0.423 | 4.313 |
| −0.639 | −0.171 | 4.313 | −0.981 | 0.081 | 4.313 | 2.001 | −0.430 | 4.313 |
| −0.741 | −0.141 | 4.313 | −0.891 | 0.058 | 4.313 | | | |
| −0.838 | −0.111 | 4.313 | −0.797 | 0.035 | 4.313 | | | |
| 1.976 | −0.434 | 4.810 | −0.954 | −0.059 | 4.810 | −0.721 | 0.026 | 4.810 |
| 1.975 | −0.440 | 4.810 | −1.042 | −0.026 | 4.810 | −0.620 | 0.001 | 4.810 |
| 1.970 | −0.446 | 4.810 | −1.127 | 0.007 | 4.810 | −0.515 | −0.023 | 4.810 |
| 1.962 | −0.451 | 4.810 | −1.207 | 0.040 | 4.810 | −0.406 | −0.047 | 4.810 |
| 1.951 | −0.452 | 4.810 | −1.284 | 0.072 | 4.810 | −0.296 | −0.070 | 4.810 |
| 1.936 | −0.451 | 4.810 | −1.353 | 0.103 | 4.810 | −0.187 | −0.091 | 4.810 |
| 1.916 | −0.451 | 4.810 | −1.415 | 0.131 | 4.810 | −0.077 | −0.112 | 4.810 |
| 1.892 | −0.451 | 4.810 | −1.469 | 0.157 | 4.810 | 0.033 | −0.133 | 4.810 |
| 1.862 | −0.450 | 4.810 | −1.520 | 0.182 | 4.810 | 0.143 | −0.152 | 4.810 |
| 1.827 | −0.449 | 4.810 | −1.564 | 0.205 | 4.810 | 0.254 | −0.171 | 4.810 |
| 1.785 | −0.448 | 4.810 | −1.597 | 0.223 | 4.810 | 0.364 | −0.189 | 4.810 |
| 1.736 | −0.447 | 4.810 | −1.623 | 0.239 | 4.810 | 0.474 | −0.206 | 4.810 |
| 1.680 | −0.446 | 4.810 | −1.641 | 0.252 | 4.810 | 0.585 | −0.223 | 4.810 |
| 1.615 | −0.444 | 4.810 | −1.654 | 0.264 | 4.810 | 0.695 | −0.240 | 4.810 |
| 1.544 | −0.442 | 4.810 | −1.660 | 0.271 | 4.810 | 0.806 | −0.257 | 4.810 |
| 1.465 | −0.440 | 4.810 | −1.663 | 0.276 | 4.810 | 0.913 | −0.273 | 4.810 |
| 1.378 | −0.438 | 4.810 | −1.663 | 0.279 | 4.810 | 1.016 | −0.289 | 4.810 |
| 1.287 | −0.435 | 4.810 | −1.663 | 0.281 | 4.810 | 1.116 | −0.303 | 4.810 |
| 1.193 | −0.431 | 4.810 | −1.663 | 0.281 | 4.810 | 1.212 | −0.317 | 4.810 |
| 1.095 | −0.427 | 4.810 | −1.663 | 0.282 | 4.810 | 1.304 | −0.330 | 4.810 |
| 0.994 | −0.422 | 4.810 | −1.662 | 0.283 | 4.810 | 1.392 | −0.343 | 4.810 |
| 0.888 | −0.416 | 4.810 | −1.659 | 0.285 | 4.810 | 1.477 | −0.354 | 4.810 |
| 0.779 | −0.409 | 4.810 | −1.653 | 0.286 | 4.810 | 1.555 | −0.364 | 4.810 |

TABLE 16R-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.667 | −0.401 | 4.810 | −1.644 | 0.287 | 4.810 | 1.625 | −0.374 | 4.810 |
| 0.554 | −0.391 | 4.810 | −1.627 | 0.285 | 4.810 | 1.688 | −0.382 | 4.810 |
| 0.442 | −0.379 | 4.810 | −1.605 | 0.281 | 4.810 | 1.743 | −0.388 | 4.810 |
| 0.329 | −0.367 | 4.810 | −1.576 | 0.274 | 4.810 | 1.792 | −0.394 | 4.810 |
| 0.217 | −0.352 | 4.810 | −1.540 | 0.264 | 4.810 | 1.832 | −0.399 | 4.810 |
| 0.105 | −0.335 | 4.810 | −1.494 | 0.249 | 4.810 | 1.867 | −0.403 | 4.810 |
| −0.007 | −0.317 | 4.810 | −1.441 | 0.232 | 4.810 | 1.896 | −0.407 | 4.810 |
| −0.118 | −0.296 | 4.810 | −1.384 | 0.214 | 4.810 | 1.920 | −0.409 | 4.810 |
| −0.229 | −0.272 | 4.810 | −1.320 | 0.194 | 4.810 | 1.940 | −0.412 | 4.810 |
| −0.339 | −0.246 | 4.810 | −1.249 | 0.172 | 4.810 | 1.955 | −0.413 | 4.810 |
| −0.449 | −0.218 | 4.810 | −1.170 | 0.148 | 4.810 | 1.965 | −0.416 | 4.810 |
| −0.558 | −0.188 | 4.810 | −1.088 | 0.124 | 4.810 | 1.972 | −0.422 | 4.810 |
| −0.663 | −0.157 | 4.810 | −1.002 | 0.100 | 4.810 | 1.975 | −0.428 | 4.810 |
| −0.764 | −0.125 | 4.810 | −0.912 | 0.075 | 4.810 | | | |
| −0.861 | −0.092 | 4.810 | −0.819 | 0.051 | 4.810 | | | |
| 1.921 | −0.440 | 5.308 | −1.007 | 0.001 | 5.308 | −0.774 | 0.067 | 5.308 |
| 1.920 | −0.445 | 5.308 | −1.094 | 0.041 | 5.308 | −0.673 | 0.038 | 5.308 |
| 1.916 | −0.452 | 5.308 | −1.176 | 0.080 | 5.308 | −0.569 | 0.009 | 5.308 |
| 1.908 | −0.456 | 5.308 | −1.255 | 0.119 | 5.308 | −0.460 | −0.019 | 5.308 |
| 1.896 | −0.457 | 5.308 | −1.329 | 0.158 | 5.308 | −0.351 | −0.046 | 5.308 |
| 1.881 | −0.457 | 5.308 | −1.397 | 0.194 | 5.308 | −0.242 | −0.071 | 5.308 |
| 1.861 | −0.457 | 5.308 | −1.457 | 0.227 | 5.308 | −0.133 | −0.094 | 5.308 |
| 1.837 | −0.457 | 5.308 | −1.509 | 0.258 | 5.308 | −0.023 | −0.117 | 5.308 |
| 1.806 | −0.456 | 5.308 | −1.558 | 0.287 | 5.308 | 0.087 | −0.138 | 5.308 |
| 1.771 | −0.456 | 5.308 | −1.600 | 0.314 | 5.308 | 0.197 | −0.160 | 5.308 |
| 1.729 | −0.455 | 5.308 | −1.632 | 0.335 | 5.308 | 0.307 | −0.180 | 5.308 |
| 1.680 | −0.454 | 5.308 | −1.657 | 0.353 | 5.308 | 0.418 | −0.199 | 5.308 |
| 1.622 | −0.453 | 5.308 | −1.674 | 0.367 | 5.308 | 0.528 | −0.218 | 5.308 |
| 1.558 | −0.451 | 5.308 | −1.687 | 0.379 | 5.308 | 0.639 | −0.237 | 5.308 |
| 1.486 | −0.450 | 5.308 | −1.693 | 0.387 | 5.308 | 0.749 | −0.254 | 5.308 |
| 1.406 | −0.448 | 5.308 | −1.696 | 0.392 | 5.308 | 0.856 | −0.271 | 5.308 |
| 1.318 | −0.446 | 5.308 | −1.696 | 0.395 | 5.308 | 0.960 | −0.287 | 5.308 |
| 1.227 | −0.444 | 5.308 | −1.696 | 0.397 | 5.308 | 1.060 | −0.303 | 5.308 |
| 1.132 | −0.440 | 5.308 | −1.696 | 0.397 | 5.308 | 1.156 | −0.317 | 5.308 |
| 1.033 | −0.437 | 5.308 | −1.695 | 0.398 | 5.308 | 1.248 | −0.331 | 5.308 |
| 0.931 | −0.432 | 5.308 | −1.694 | 0.399 | 5.308 | 1.337 | −0.344 | 5.308 |
| 0.825 | −0.426 | 5.308 | −1.691 | 0.400 | 5.308 | 1.422 | −0.357 | 5.308 |
| 0.715 | −0.418 | 5.308 | −1.685 | 0.400 | 5.308 | 1.499 | −0.367 | 5.308 |
| 0.601 | −0.409 | 5.308 | −1.676 | 0.399 | 5.308 | 1.570 | −0.377 | 5.308 |
| 0.488 | −0.397 | 5.308 | −1.659 | 0.395 | 5.308 | 1.633 | −0.385 | 5.308 |
| 0.376 | −0.384 | 5.308 | −1.638 | 0.388 | 5.308 | 1.688 | −0.392 | 5.308 |
| 0.263 | −0.368 | 5.308 | −1.610 | 0.378 | 5.308 | 1.737 | −0.398 | 5.308 |
| 0.152 | −0.350 | 5.308 | −1.576 | 0.363 | 5.308 | 1.777 | −0.404 | 5.308 |
| 0.040 | −0.330 | 5.308 | −1.531 | 0.344 | 5.308 | 1.812 | −0.408 | 5.308 |
| −0.070 | −0.307 | 5.308 | −1.479 | 0.322 | 5.308 | 1.842 | −0.412 | 5.308 |
| −0.181 | −0.282 | 5.308 | −1.424 | 0.299 | 5.308 | 1.866 | −0.415 | 5.308 |
| −0.290 | −0.253 | 5.308 | −1.362 | 0.274 | 5.308 | 1.885 | −0.417 | 5.308 |
| −0.400 | −0.222 | 5.308 | −1.292 | 0.246 | 5.308 | 1.900 | −0.419 | 5.308 |
| −0.508 | −0.189 | 5.308 | −1.216 | 0.217 | 5.308 | 1.911 | −0.421 | 5.308 |
| −0.617 | −0.153 | 5.308 | −1.135 | 0.187 | 5.308 | 1.918 | −0.427 | 5.308 |
| −0.721 | −0.115 | 5.308 | −1.051 | 0.157 | 5.308 | 1.921 | −0.434 | 5.308 |
| −0.820 | −0.077 | 5.308 | −0.962 | 0.127 | 5.308 | | | |
| −0.916 | −0.038 | 5.308 | −0.870 | 0.097 | 5.308 | | | |

The coordinate values given in TABLE IGV below provide the nominal profile envelope for an exemplary inlet guide vane.

TABLE IGV

| X-LOC | Y-LOC | Z-LOC | X-LOC | Y-LOC | Z-LOC | X-LOC | Y-LOC | Z-LOC |
|---|---|---|---|---|---|---|---|---|
| −4.169 | −0.430 | 0.000 | 0.476 | 0.541 | 0.000 | 0.228 | 0.081 | 0.000 |
| −4.168 | −0.429 | 0.000 | 0.625 | 0.568 | 0.000 | 0.065 | 0.018 | 0.000 |
| −4.168 | −0.427 | 0.000 | 0.767 | 0.594 | 0.000 | −0.105 | −0.046 | 0.000 |
| −4.166 | −0.422 | 0.000 | 0.903 | 0.621 | 0.000 | −0.281 | −0.111 | 0.000 |
| −4.162 | −0.414 | 0.000 | 1.027 | 0.646 | 0.000 | −0.457 | −0.175 | 0.000 |
| −4.153 | −0.401 | 0.000 | 1.140 | 0.669 | 0.000 | −0.633 | −0.236 | 0.000 |
| −4.133 | −0.383 | 0.000 | 1.240 | 0.691 | 0.000 | −0.811 | −0.296 | 0.000 |
| −4.101 | −0.365 | 0.000 | 1.328 | 0.711 | 0.000 | −0.989 | −0.353 | 0.000 |
| −4.058 | −0.344 | 0.000 | 1.404 | 0.730 | 0.000 | −1.167 | −0.407 | 0.000 |
| −4.001 | −0.323 | 0.000 | 1.468 | 0.747 | 0.000 | −1.346 | −0.459 | 0.000 |
| −3.926 | −0.300 | 0.000 | 1.523 | 0.763 | 0.000 | −1.526 | −0.507 | 0.000 |

TABLE IGV-continued

| X-LOC | Y-LOC | Z-LOC | X-LOC | Y-LOC | Z-LOC | X-LOC | Y-LOC | Z-LOC |
|---|---|---|---|---|---|---|---|---|
| −3.839 | −0.275 | 0.000 | 1.569 | 0.776 | 0.000 | −1.708 | −0.551 | 0.000 |
| −3.746 | −0.250 | 0.000 | 1.607 | 0.786 | 0.000 | −1.890 | −0.592 | 0.000 |
| −3.640 | −0.224 | 0.000 | 1.638 | 0.784 | 0.000 | −2.073 | −0.628 | 0.000 |
| −3.523 | −0.195 | 0.000 | 1.659 | 0.775 | 0.000 | −2.258 | −0.660 | 0.000 |
| −3.394 | −0.164 | 0.000 | 1.673 | 0.763 | 0.000 | −2.438 | −0.685 | 0.000 |
| −3.259 | −0.132 | 0.000 | 1.683 | 0.752 | 0.000 | −2.613 | −0.704 | 0.000 |
| −3.118 | −0.100 | 0.000 | 1.689 | 0.742 | 0.000 | −2.783 | −0.718 | 0.000 |
| −2.971 | −0.066 | 0.000 | 1.692 | 0.733 | 0.000 | −2.946 | −0.726 | 0.000 |
| −2.818 | −0.033 | 0.000 | 1.695 | 0.724 | 0.000 | −3.104 | −0.729 | 0.000 |
| −2.658 | 0.001 | 0.000 | 1.697 | 0.712 | 0.000 | −3.255 | −0.727 | 0.000 |
| −2.493 | 0.036 | 0.000 | 1.696 | 0.696 | 0.000 | −3.400 | −0.719 | 0.000 |
| −2.321 | 0.070 | 0.000 | 1.692 | 0.678 | 0.000 | −3.538 | −0.706 | 0.000 |
| −2.144 | 0.104 | 0.000 | 1.679 | 0.656 | 0.000 | −3.663 | −0.688 | 0.000 |
| −1.966 | 0.137 | 0.000 | 1.655 | 0.636 | 0.000 | −3.775 | −0.666 | 0.000 |
| −1.787 | 0.169 | 0.000 | 1.617 | 0.621 | 0.000 | −3.872 | −0.641 | 0.000 |
| −1.609 | 0.200 | 0.000 | 1.571 | 0.603 | 0.000 | −3.962 | −0.611 | 0.000 |
| −1.430 | 0.231 | 0.000 | 1.516 | 0.583 | 0.000 | −4.038 | −0.580 | 0.000 |
| −1.252 | 0.260 | 0.000 | 1.451 | 0.559 | 0.000 | −4.093 | −0.549 | 0.000 |
| −1.073 | 0.290 | 0.000 | 1.375 | 0.530 | 0.000 | −4.133 | −0.519 | 0.000 |
| −0.894 | 0.318 | 0.000 | 1.287 | 0.497 | 0.000 | −4.159 | −0.490 | 0.000 |
| −0.716 | 0.347 | 0.000 | 1.188 | 0.459 | 0.000 | −4.170 | −0.465 | 0.000 |
| −0.537 | 0.375 | 0.000 | 1.077 | 0.417 | 0.000 | −4.172 | −0.449 | 0.000 |
| −0.358 | 0.403 | 0.000 | 0.955 | 0.369 | 0.000 | −4.171 | −0.439 | 0.000 |
| −0.179 | 0.431 | 0.000 | 0.821 | 0.316 | 0.000 | −4.170 | −0.434 | 0.000 |
| −0.006 | 0.459 | 0.000 | 0.682 | 0.260 | 0.000 | −4.169 | −0.432 | 0.000 |
| 0.161 | 0.486 | 0.000 | 0.536 | 0.203 | 0.000 | | | |
| 0.321 | 0.514 | 0.000 | 0.385 | 0.143 | 0.000 | | | |
| −3.972 | −0.403 | 1.536 | 0.518 | 0.487 | 1.536 | 0.269 | 0.085 | 1.536 |
| −3.971 | −0.402 | 1.536 | 0.661 | 0.514 | 1.536 | 0.111 | 0.027 | 1.536 |
| −3.971 | −0.400 | 1.536 | 0.798 | 0.540 | 1.536 | −0.053 | −0.032 | 1.536 |
| −3.969 | −0.396 | 1.536 | 0.929 | 0.566 | 1.536 | −0.223 | −0.091 | 1.536 |
| −3.964 | −0.387 | 1.536 | 1.049 | 0.590 | 1.536 | −0.393 | −0.149 | 1.536 |
| −3.955 | −0.376 | 1.536 | 1.157 | 0.613 | 1.536 | −0.564 | −0.206 | 1.536 |
| −3.933 | −0.361 | 1.536 | 1.254 | 0.634 | 1.536 | −0.736 | −0.260 | 1.536 |
| −3.902 | −0.346 | 1.536 | 1.339 | 0.653 | 1.536 | −0.908 | −0.313 | 1.536 |
| −3.858 | −0.330 | 1.536 | 1.412 | 0.671 | 1.536 | −1.081 | −0.363 | 1.536 |
| −3.802 | −0.313 | 1.536 | 1.474 | 0.688 | 1.536 | −1.255 | −0.410 | 1.536 |
| −3.729 | −0.294 | 1.536 | 1.526 | 0.702 | 1.536 | −1.429 | −0.454 | 1.536 |
| −3.645 | −0.274 | 1.536 | 1.571 | 0.715 | 1.536 | −1.605 | −0.495 | 1.536 |
| −3.554 | −0.253 | 1.536 | 1.607 | 0.726 | 1.536 | −1.781 | −0.533 | 1.536 |
| −3.452 | −0.231 | 1.536 | 1.636 | 0.730 | 1.536 | −1.958 | −0.566 | 1.536 |
| −3.338 | −0.206 | 1.536 | 1.658 | 0.724 | 1.536 | −2.136 | −0.595 | 1.536 |
| −3.213 | −0.180 | 1.536 | 1.673 | 0.714 | 1.536 | −2.308 | −0.619 | 1.536 |
| −3.082 | −0.152 | 1.536 | 1.683 | 0.704 | 1.536 | −2.475 | −0.637 | 1.536 |
| −2.945 | −0.123 | 1.536 | 1.689 | 0.694 | 1.536 | −2.637 | −0.650 | 1.536 |
| −2.803 | −0.094 | 1.536 | 1.692 | 0.686 | 1.536 | −2.793 | −0.658 | 1.536 |
| −2.655 | −0.064 | 1.536 | 1.694 | 0.677 | 1.536 | −2.943 | −0.662 | 1.536 |
| −2.501 | −0.033 | 1.536 | 1.696 | 0.665 | 1.536 | −3.087 | −0.661 | 1.536 |
| −2.341 | −0.001 | 1.536 | 1.694 | 0.650 | 1.536 | −3.226 | −0.655 | 1.536 |
| −2.176 | 0.030 | 1.536 | 1.688 | 0.633 | 1.536 | −3.357 | −0.644 | 1.536 |
| −2.004 | 0.062 | 1.536 | 1.673 | 0.615 | 1.536 | −3.477 | −0.629 | 1.536 |
| −1.833 | 0.093 | 1.536 | 1.646 | 0.600 | 1.536 | −3.583 | −0.611 | 1.536 |
| −1.661 | 0.123 | 1.536 | 1.609 | 0.586 | 1.536 | −3.677 | −0.589 | 1.536 |
| −1.489 | 0.153 | 1.536 | 1.565 | 0.570 | 1.536 | −3.764 | −0.564 | 1.536 |
| −1.317 | 0.183 | 1.536 | 1.512 | 0.551 | 1.536 | −3.837 | −0.537 | 1.536 |
| −1.145 | 0.211 | 1.536 | 1.450 | 0.528 | 1.536 | −3.891 | −0.510 | 1.536 |
| −0.973 | 0.240 | 1.536 | 1.376 | 0.501 | 1.536 | −3.931 | −0.484 | 1.536 |
| −0.801 | 0.268 | 1.536 | 1.292 | 0.471 | 1.536 | −3.957 | −0.459 | 1.536 |
| −0.629 | 0.296 | 1.536 | 1.196 | 0.435 | 1.536 | −3.971 | −0.436 | 1.536 |
| −0.457 | 0.324 | 1.536 | 1.089 | 0.396 | 1.536 | −3.974 | −0.421 | 1.536 |
| −0.284 | 0.352 | 1.536 | 0.971 | 0.351 | 1.536 | −3.974 | −0.411 | 1.536 |
| −0.112 | 0.380 | 1.536 | 0.842 | 0.302 | 1.536 | −3.973 | −0.407 | 1.536 |
| 0.054 | 0.407 | 1.536 | 0.707 | 0.251 | 1.536 | −3.972 | −0.404 | 1.536 |
| 0.214 | 0.434 | 1.536 | 0.567 | 0.197 | 1.536 | | | |
| 0.369 | 0.461 | 1.536 | 0.421 | 0.142 | 1.536 | | | |
| −3.775 | −0.374 | 3.071 | 0.558 | 0.409 | 3.071 | 0.311 | 0.068 | 3.071 |
| −3.775 | −0.373 | 3.071 | 0.695 | 0.434 | 3.071 | 0.159 | 0.017 | 3.071 |
| −3.774 | −0.371 | 3.071 | 0.827 | 0.458 | 3.071 | 0.001 | −0.036 | 3.071 |
| −3.772 | −0.367 | 3.071 | 0.953 | 0.482 | 3.071 | −0.162 | −0.088 | 3.071 |
| −3.767 | −0.360 | 3.071 | 1.068 | 0.504 | 3.071 | −0.326 | −0.140 | 3.071 |
| −3.756 | −0.350 | 3.071 | 1.172 | 0.525 | 3.071 | −0.490 | −0.190 | 3.071 |
| −3.734 | −0.339 | 3.071 | 1.265 | 0.545 | 3.071 | −0.654 | −0.238 | 3.071 |
| −3.702 | −0.327 | 3.071 | 1.347 | 0.563 | 3.071 | −0.819 | −0.284 | 3.071 |
| −3.659 | −0.315 | 3.071 | 1.418 | 0.579 | 3.071 | −0.985 | −0.328 | 3.071 |
| −3.605 | −0.302 | 3.071 | 1.478 | 0.594 | 3.071 | −1.151 | −0.369 | 3.071 |
| −3.534 | −0.287 | 3.071 | 1.528 | 0.608 | 3.071 | −1.317 | −0.408 | 3.071 |
| −3.452 | −0.271 | 3.071 | 1.571 | 0.619 | 3.071 | −1.484 | −0.445 | 3.071 |

TABLE IGV-continued

| X-LOC | Y-LOC | Z-LOC | X-LOC | Y-LOC | Z-LOC | X-LOC | Y-LOC | Z-LOC |
|---|---|---|---|---|---|---|---|---|
| −3.364 | −0.255 | 3.071 | 1.606 | 0.629 | 3.071 | −1.652 | −0.478 | 3.071 |
| −3.265 | −0.237 | 3.071 | 1.634 | 0.637 | 3.071 | −1.821 | −0.508 | 3.071 |
| −3.155 | −0.218 | 3.071 | 1.656 | 0.636 | 3.071 | −1.991 | −0.534 | 3.071 |
| −3.034 | −0.196 | 3.071 | 1.672 | 0.629 | 3.071 | −2.156 | −0.555 | 3.071 |
| −2.908 | −0.172 | 3.071 | 1.682 | 0.620 | 3.071 | −2.316 | −0.572 | 3.071 |
| −2.776 | −0.148 | 3.071 | 1.688 | 0.610 | 3.071 | −2.471 | −0.584 | 3.071 |
| −2.638 | −0.123 | 3.071 | 1.692 | 0.602 | 3.071 | −2.622 | −0.593 | 3.071 |
| −2.495 | −0.097 | 3.071 | 1.694 | 0.594 | 3.071 | −2.767 | −0.597 | 3.071 |
| −2.347 | −0.070 | 3.071 | 1.694 | 0.582 | 3.071 | −2.906 | −0.597 | 3.071 |
| −2.193 | −0.042 | 3.071 | 1.691 | 0.568 | 3.071 | −3.040 | −0.593 | 3.071 |
| −2.034 | −0.014 | 3.071 | 1.683 | 0.553 | 3.071 | −3.167 | −0.584 | 3.071 |
| −1.868 | 0.014 | 3.071 | 1.665 | 0.539 | 3.071 | −3.283 | −0.572 | 3.071 |
| −1.703 | 0.042 | 3.071 | 1.637 | 0.529 | 3.071 | −3.386 | −0.556 | 3.071 |
| −1.538 | 0.070 | 3.071 | 1.602 | 0.516 | 3.071 | −3.477 | −0.538 | 3.071 |
| −1.373 | 0.097 | 3.071 | 1.559 | 0.502 | 3.071 | −3.562 | −0.516 | 3.071 |
| −1.207 | 0.124 | 3.071 | 1.508 | 0.484 | 3.071 | −3.633 | −0.493 | 3.071 |
| −1.042 | 0.151 | 3.071 | 1.448 | 0.464 | 3.071 | −3.687 | −0.470 | 3.071 |
| −0.876 | 0.177 | 3.071 | 1.378 | 0.440 | 3.071 | −3.727 | −0.448 | 3.071 |
| −0.711 | 0.203 | 3.071 | 1.296 | 0.412 | 3.071 | −3.755 | −0.426 | 3.071 |
| −0.545 | 0.230 | 3.071 | 1.204 | 0.381 | 3.071 | −3.771 | −0.405 | 3.071 |
| −0.380 | 0.256 | 3.071 | 1.101 | 0.345 | 3.071 | −3.776 | −0.392 | 3.071 |
| −0.214 | 0.282 | 3.071 | 0.987 | 0.305 | 3.071 | −3.776 | −0.382 | 3.071 |
| −0.049 | 0.308 | 3.071 | 0.863 | 0.261 | 3.071 | −3.776 | −0.378 | 3.071 |
| 0.111 | 0.334 | 3.071 | 0.733 | 0.215 | 3.071 | −3.775 | −0.376 | 3.071 |
| 0.266 | 0.359 | 3.071 | 0.598 | 0.168 | 3.071 | | | |
| 0.414 | 0.384 | 3.071 | 0.457 | 0.118 | 3.071 | | | |
| −3.579 | −0.345 | 4.607 | 0.599 | 0.338 | 4.607 | 0.349 | 0.054 | 4.607 |
| −3.579 | −0.344 | 4.607 | 0.731 | 0.361 | 4.607 | 0.202 | 0.009 | 4.607 |
| −3.578 | −0.342 | 4.607 | 0.858 | 0.383 | 4.607 | 0.050 | −0.037 | 4.607 |
| −3.576 | −0.339 | 4.607 | 0.979 | 0.406 | 4.607 | −0.108 | −0.083 | 4.607 |
| −3.570 | −0.332 | 4.607 | 1.090 | 0.426 | 4.607 | −0.266 | −0.128 | 4.607 |
| −3.558 | −0.325 | 4.607 | 1.190 | 0.446 | 4.607 | −0.425 | −0.172 | 4.607 |
| −3.536 | −0.317 | 4.607 | 1.280 | 0.464 | 4.607 | −0.584 | −0.214 | 4.607 |
| −3.505 | −0.308 | 4.607 | 1.358 | 0.480 | 4.607 | −0.744 | −0.255 | 4.607 |
| −3.463 | −0.300 | 4.607 | 1.427 | 0.495 | 4.607 | −0.904 | −0.293 | 4.607 |
| −3.410 | −0.291 | 4.607 | 1.484 | 0.509 | 4.607 | −1.064 | −0.330 | 4.607 |
| −3.341 | −0.280 | 4.607 | 1.533 | 0.521 | 4.607 | −1.225 | −0.364 | 4.607 |
| −3.261 | −0.268 | 4.607 | 1.574 | 0.532 | 4.607 | −1.387 | −0.396 | 4.607 |
| −3.176 | −0.256 | 4.607 | 1.608 | 0.541 | 4.607 | −1.548 | −0.425 | 4.607 |
| −3.081 | −0.242 | 4.607 | 1.635 | 0.548 | 4.607 | −1.711 | −0.452 | 4.607 |
| −2.974 | −0.226 | 4.607 | 1.655 | 0.552 | 4.607 | −1.874 | −0.474 | 4.607 |
| −2.858 | −0.208 | 4.607 | 1.671 | 0.548 | 4.607 | −2.032 | −0.493 | 4.607 |
| −2.736 | −0.189 | 4.607 | 1.682 | 0.540 | 4.607 | −2.185 | −0.508 | 4.607 |
| −2.608 | −0.169 | 4.607 | 1.688 | 0.532 | 4.607 | −2.333 | −0.519 | 4.607 |
| −2.476 | −0.147 | 4.607 | 1.691 | 0.524 | 4.607 | −2.476 | −0.527 | 4.607 |
| −2.338 | −0.125 | 4.607 | 1.693 | 0.516 | 4.607 | −2.613 | −0.531 | 4.607 |
| −2.195 | −0.102 | 4.607 | 1.692 | 0.505 | 4.607 | −2.745 | −0.531 | 4.607 |
| −2.047 | −0.078 | 4.607 | 1.688 | 0.492 | 4.607 | −2.871 | −0.528 | 4.607 |
| −1.893 | −0.054 | 4.607 | 1.676 | 0.480 | 4.607 | −2.991 | −0.522 | 4.607 |
| −1.734 | −0.028 | 4.607 | 1.656 | 0.472 | 4.607 | −3.101 | −0.512 | 4.607 |
| −1.575 | −0.003 | 4.607 | 1.629 | 0.463 | 4.607 | −3.199 | −0.499 | 4.607 |
| −1.416 | 0.022 | 4.607 | 1.595 | 0.452 | 4.607 | −3.285 | −0.484 | 4.607 |
| −1.257 | 0.047 | 4.607 | 1.554 | 0.438 | 4.607 | −3.366 | −0.466 | 4.607 |
| −1.098 | 0.071 | 4.607 | 1.505 | 0.423 | 4.607 | −3.435 | −0.446 | 4.607 |
| −0.939 | 0.096 | 4.607 | 1.447 | 0.405 | 4.607 | −3.486 | −0.428 | 4.607 |
| −0.780 | 0.120 | 4.607 | 1.379 | 0.383 | 4.607 | −3.526 | −0.409 | 4.607 |
| −0.621 | 0.145 | 4.607 | 1.300 | 0.358 | 4.607 | −3.554 | −0.391 | 4.607 |
| −0.461 | 0.169 | 4.607 | 1.212 | 0.330 | 4.607 | −3.571 | −0.374 | 4.607 |
| −0.302 | 0.194 | 4.607 | 1.112 | 0.299 | 4.607 | −3.578 | −0.362 | 4.607 |
| −0.143 | 0.218 | 4.607 | 1.002 | 0.263 | 4.607 | −3.580 | −0.353 | 4.607 |
| 0.016 | 0.243 | 4.607 | 0.882 | 0.225 | 4.607 | −3.579 | −0.349 | 4.607 |
| 0.170 | 0.267 | 4.607 | 0.757 | 0.184 | 4.607 | −3.579 | −0.346 | 4.607 |
| 0.318 | 0.291 | 4.607 | 0.626 | 0.142 | 4.607 | | | |
| 0.461 | 0.315 | 4.607 | 0.490 | 0.099 | 4.607 | | | |
| −3.383 | −0.317 | 6.143 | 0.638 | 0.283 | 6.143 | 0.393 | 0.049 | 6.143 |
| −3.383 | −0.316 | 6.143 | 0.765 | 0.305 | 6.143 | 0.252 | 0.009 | 6.143 |
| −3.382 | −0.314 | 6.143 | 0.887 | 0.326 | 6.143 | 0.105 | −0.031 | 6.143 |
| −3.380 | −0.310 | 6.143 | 1.004 | 0.346 | 6.143 | −0.047 | −0.071 | 6.143 |
| −3.374 | −0.305 | 6.143 | 1.110 | 0.366 | 6.143 | −0.199 | −0.110 | 6.143 |
| −3.362 | −0.299 | 6.143 | 1.207 | 0.383 | 6.143 | −0.351 | −0.148 | 6.143 |
| −3.340 | −0.293 | 6.143 | 1.293 | 0.400 | 6.143 | −0.504 | −0.185 | 6.143 |
| −3.309 | −0.288 | 6.143 | 1.369 | 0.415 | 6.143 | −0.656 | −0.221 | 6.143 |
| −3.268 | −0.282 | 6.143 | 1.434 | 0.428 | 6.143 | −0.810 | −0.254 | 6.143 |
| −3.217 | −0.276 | 6.143 | 1.490 | 0.441 | 6.143 | −0.964 | −0.286 | 6.143 |
| −3.151 | −0.268 | 6.143 | 1.537 | 0.452 | 6.143 | −1.118 | −0.317 | 6.143 |
| −3.074 | −0.259 | 6.143 | 1.576 | 0.461 | 6.143 | −1.272 | −0.344 | 6.143 |
| −2.992 | −0.249 | 6.143 | 1.609 | 0.470 | 6.143 | −1.427 | −0.370 | 6.143 |

TABLE IGV-continued

| X-LOC | Y-LOC | Z-LOC | X-LOC | Y-LOC | Z-LOC | X-LOC | Y-LOC | Z-LOC |
|---|---|---|---|---|---|---|---|---|
| −2.900 | −0.238 | 6.143 | 1.635 | 0.476 | 6.143 | −1.583 | −0.394 | 6.143 |
| −2.798 | −0.226 | 6.143 | 1.655 | 0.482 | 6.143 | −1.739 | −0.414 | 6.143 |
| −2.685 | −0.211 | 6.143 | 1.670 | 0.481 | 6.143 | −1.891 | −0.431 | 6.143 |
| −2.568 | −0.195 | 6.143 | 1.681 | 0.475 | 6.143 | −2.037 | −0.445 | 6.143 |
| −2.445 | −0.178 | 6.143 | 1.688 | 0.467 | 6.143 | −2.179 | −0.455 | 6.143 |
| −2.318 | −0.160 | 6.143 | 1.691 | 0.460 | 6.143 | −2.316 | −0.463 | 6.143 |
| −2.185 | −0.141 | 6.143 | 1.692 | 0.452 | 6.143 | −2.447 | −0.467 | 6.143 |
| −2.047 | −0.121 | 6.143 | 1.691 | 0.442 | 6.143 | −2.573 | −0.469 | 6.143 |
| −1.905 | −0.100 | 6.143 | 1.684 | 0.430 | 6.143 | −2.694 | −0.467 | 6.143 |
| −1.757 | −0.078 | 6.143 | 1.671 | 0.422 | 6.143 | −2.810 | −0.462 | 6.143 |
| −1.604 | −0.056 | 6.143 | 1.651 | 0.415 | 6.143 | −2.915 | −0.455 | 6.143 |
| −1.451 | −0.033 | 6.143 | 1.625 | 0.408 | 6.143 | −3.009 | −0.445 | 6.143 |
| −1.298 | −0.011 | 6.143 | 1.592 | 0.398 | 6.143 | −3.092 | −0.432 | 6.143 |
| −1.145 | 0.012 | 6.143 | 1.552 | 0.386 | 6.143 | −3.170 | −0.418 | 6.143 |
| −0.992 | 0.035 | 6.143 | 1.505 | 0.372 | 6.143 | −3.237 | −0.402 | 6.143 |
| −0.839 | 0.058 | 6.143 | 1.450 | 0.356 | 6.143 | −3.287 | −0.387 | 6.143 |
| −0.686 | 0.080 | 6.143 | 1.384 | 0.337 | 6.143 | −3.326 | −0.371 | 6.143 |
| −0.533 | 0.103 | 6.143 | 1.309 | 0.315 | 6.143 | −3.354 | −0.356 | 6.143 |
| −0.380 | 0.126 | 6.143 | 1.223 | 0.291 | 6.143 | −3.373 | −0.342 | 6.143 |
| −0.228 | 0.149 | 6.143 | 1.127 | 0.263 | 6.143 | −3.381 | −0.332 | 6.143 |
| −0.075 | 0.172 | 6.143 | 1.022 | 0.232 | 6.143 | −3.384 | −0.324 | 6.143 |
| 0.078 | 0.195 | 6.143 | 0.906 | 0.198 | 6.143 | −3.384 | −0.320 | 6.143 |
| 0.226 | 0.217 | 6.143 | 0.785 | 0.162 | 6.143 | −3.384 | −0.318 | 6.143 |
| 0.369 | 0.240 | 6.143 | 0.660 | 0.125 | 6.143 | | | |
| 0.506 | 0.262 | 6.143 | 0.529 | 0.087 | 6.143 | | | |
| −3.188 | −0.287 | 7.678 | 0.678 | 0.251 | 7.678 | 0.438 | 0.045 | 7.678 |
| −3.187 | −0.286 | 7.678 | 0.800 | 0.270 | 7.678 | 0.302 | 0.010 | 7.678 |
| −3.187 | −0.284 | 7.678 | 0.917 | 0.289 | 7.678 | 0.161 | −0.025 | 7.678 |
| −3.184 | −0.281 | 7.678 | 1.029 | 0.308 | 7.678 | 0.015 | −0.061 | 7.678 |
| −3.178 | −0.276 | 7.678 | 1.132 | 0.326 | 7.678 | −0.132 | −0.096 | 7.678 |
| −3.167 | −0.272 | 7.678 | 1.224 | 0.342 | 7.678 | −0.278 | −0.130 | 7.678 |
| −3.145 | −0.267 | 7.678 | 1.307 | 0.357 | 7.678 | −0.425 | −0.163 | 7.678 |
| −3.115 | −0.262 | 7.678 | 1.380 | 0.370 | 7.678 | −0.572 | −0.194 | 7.678 |
| −3.076 | −0.258 | 7.678 | 1.443 | 0.383 | 7.678 | −0.720 | −0.224 | 7.678 |
| −3.027 | −0.252 | 7.678 | 1.496 | 0.394 | 7.678 | −0.867 | −0.253 | 7.678 |
| −2.963 | −0.246 | 7.678 | 1.542 | 0.404 | 7.678 | −1.016 | −0.280 | 7.678 |
| −2.889 | −0.238 | 7.678 | 1.580 | 0.413 | 7.678 | −1.164 | −0.305 | 7.678 |
| −2.811 | −0.230 | 7.678 | 1.611 | 0.420 | 7.678 | −1.313 | −0.328 | 7.678 |
| −2.722 | −0.221 | 7.678 | 1.636 | 0.426 | 7.678 | −1.462 | −0.349 | 7.678 |
| −2.624 | −0.210 | 7.678 | 1.655 | 0.431 | 7.678 | −1.612 | −0.367 | 7.678 |
| −2.515 | −0.198 | 7.678 | 1.670 | 0.431 | 7.678 | −1.757 | −0.383 | 7.678 |
| −2.403 | −0.184 | 7.678 | 1.681 | 0.426 | 7.678 | −1.897 | −0.395 | 7.678 |
| −2.285 | −0.169 | 7.678 | 1.687 | 0.418 | 7.678 | −2.032 | −0.405 | 7.678 |
| −2.162 | −0.153 | 7.678 | 1.690 | 0.412 | 7.678 | −2.163 | −0.412 | 7.678 |
| −2.035 | −0.136 | 7.678 | 1.691 | 0.404 | 7.678 | −2.288 | −0.416 | 7.678 |
| −1.902 | −0.118 | 7.678 | 1.689 | 0.394 | 7.678 | −2.409 | −0.418 | 7.678 |
| −1.765 | −0.100 | 7.678 | 1.682 | 0.384 | 7.678 | −2.524 | −0.417 | 7.678 |
| −1.623 | −0.080 | 7.678 | 1.669 | 0.377 | 7.678 | −2.635 | −0.413 | 7.678 |
| −1.476 | −0.060 | 7.678 | 1.649 | 0.372 | 7.678 | −2.735 | −0.407 | 7.678 |
| −1.329 | −0.039 | 7.678 | 1.624 | 0.365 | 7.678 | −2.825 | −0.398 | 7.678 |
| −1.182 | −0.019 | 7.678 | 1.593 | 0.356 | 7.678 | −2.905 | −0.388 | 7.678 |
| −1.035 | 0.002 | 7.678 | 1.554 | 0.345 | 7.678 | −2.979 | −0.376 | 7.678 |
| −0.888 | 0.022 | 7.678 | 1.509 | 0.333 | 7.678 | −3.043 | −0.362 | 7.678 |
| −0.741 | 0.043 | 7.678 | 1.456 | 0.319 | 7.678 | −3.092 | −0.349 | 7.678 |
| −0.595 | 0.064 | 7.678 | 1.393 | 0.302 | 7.678 | −3.130 | −0.336 | 7.678 |
| −0.448 | 0.085 | 7.678 | 1.320 | 0.282 | 7.678 | −3.157 | −0.323 | 7.678 |
| −0.301 | 0.106 | 7.678 | 1.238 | 0.260 | 7.678 | −3.176 | −0.310 | 7.678 |
| −0.154 | 0.127 | 7.678 | 1.145 | 0.235 | 7.678 | −3.184 | −0.301 | 7.678 |
| −0.007 | 0.148 | 7.678 | 1.044 | 0.208 | 7.678 | −3.188 | −0.294 | 7.678 |
| 0.140 | 0.169 | 7.678 | 0.932 | 0.178 | 7.678 | −3.188 | −0.290 | 7.678 |
| 0.282 | 0.190 | 7.678 | 0.816 | 0.146 | 7.678 | −3.188 | −0.288 | 7.678 |
| 0.419 | 0.210 | 7.678 | 0.695 | 0.113 | 7.678 | | | |
| 0.551 | 0.231 | 7.678 | 0.569 | 0.080 | 7.678 | | | |
| −2.992 | −0.257 | 9.214 | 0.717 | 0.232 | 9.214 | 0.485 | 0.040 | 9.214 |
| −2.992 | −0.256 | 9.214 | 0.834 | 0.250 | 9.214 | 0.354 | 0.008 | 9.214 |
| −2.991 | −0.254 | 9.214 | 0.947 | 0.267 | 9.214 | 0.219 | −0.024 | 9.214 |
| −2.989 | −0.251 | 9.214 | 1.055 | 0.283 | 9.214 | 0.079 | −0.057 | 9.214 |
| −2.983 | −0.246 | 9.214 | 1.153 | 0.299 | 9.214 | −0.062 | −0.088 | 9.214 |
| −2.972 | −0.241 | 9.214 | 1.242 | 0.313 | 9.214 | −0.203 | −0.119 | 9.214 |
| −2.951 | −0.237 | 9.214 | 1.321 | 0.327 | 9.214 | −0.344 | −0.149 | 9.214 |
| −2.923 | −0.232 | 9.214 | 1.391 | 0.339 | 9.214 | −0.485 | −0.178 | 9.214 |
| −2.885 | −0.228 | 9.214 | 1.452 | 0.350 | 9.214 | −0.626 | −0.205 | 9.214 |
| −2.838 | −0.222 | 9.214 | 1.503 | 0.359 | 9.214 | −0.768 | −0.231 | 9.214 |
| −2.777 | −0.216 | 9.214 | 1.547 | 0.368 | 9.214 | −0.910 | −0.255 | 9.214 |
| −2.706 | −0.208 | 9.214 | 1.584 | 0.376 | 9.214 | −1.053 | −0.278 | 9.214 |
| −2.631 | −0.201 | 9.214 | 1.614 | 0.383 | 9.214 | −1.196 | −0.299 | 9.214 |
| −2.546 | −0.192 | 9.214 | 1.638 | 0.388 | 9.214 | −1.339 | −0.318 | 9.214 |

TABLE IGV-continued

| X-LOC | Y-LOC | Z-LOC | X-LOC | Y-LOC | Z-LOC | X-LOC | Y-LOC | Z-LOC |
|---|---|---|---|---|---|---|---|---|
| −2.452 | −0.182 | 9.214 | 1.656 | 0.393 | 9.214 | −1.482 | −0.335 | 9.214 |
| −2.348 | −0.170 | 9.214 | 1.670 | 0.393 | 9.214 | −1.621 | −0.348 | 9.214 |
| −2.240 | −0.157 | 9.214 | 1.681 | 0.387 | 9.214 | −1.755 | −0.359 | 9.214 |
| −2.127 | −0.143 | 9.214 | 1.687 | 0.380 | 9.214 | −1.884 | −0.368 | 9.214 |
| −2.009 | −0.128 | 9.214 | 1.689 | 0.374 | 9.214 | −2.009 | −0.374 | 9.214 |
| −1.887 | −0.113 | 9.214 | 1.690 | 0.366 | 9.214 | −2.130 | −0.378 | 9.214 |
| −1.760 | −0.097 | 9.214 | 1.688 | 0.357 | 9.214 | −2.245 | −0.380 | 9.214 |
| −1.628 | −0.080 | 9.214 | 1.681 | 0.347 | 9.214 | −2.356 | −0.378 | 9.214 |
| −1.492 | −0.062 | 9.214 | 1.668 | 0.341 | 9.214 | −2.461 | −0.375 | 9.214 |
| −1.351 | −0.043 | 9.214 | 1.649 | 0.336 | 9.214 | −2.557 | −0.369 | 9.214 |
| −1.210 | −0.025 | 9.214 | 1.625 | 0.330 | 9.214 | −2.644 | −0.361 | 9.214 |
| −1.069 | −0.007 | 9.214 | 1.595 | 0.322 | 9.214 | −2.720 | −0.351 | 9.214 |
| −0.928 | 0.012 | 9.214 | 1.558 | 0.312 | 9.214 | −2.791 | −0.340 | 9.214 |
| −0.787 | 0.030 | 9.214 | 1.514 | 0.301 | 9.214 | −2.853 | −0.327 | 9.214 |
| −0.646 | 0.049 | 9.214 | 1.463 | 0.288 | 9.214 | −2.899 | −0.315 | 9.214 |
| −0.505 | 0.067 | 9.214 | 1.403 | 0.273 | 9.214 | −2.936 | −0.303 | 9.214 |
| −0.363 | 0.086 | 9.214 | 1.333 | 0.255 | 9.214 | −2.962 | −0.291 | 9.214 |
| −0.223 | 0.104 | 9.214 | 1.254 | 0.235 | 9.214 | −2.980 | −0.279 | 9.214 |
| −0.082 | 0.123 | 9.214 | 1.165 | 0.213 | 9.214 | −2.988 | −0.270 | 9.214 |
| 0.059 | 0.141 | 9.214 | 1.067 | 0.188 | 9.214 | −2.992 | −0.263 | 9.214 |
| 0.201 | 0.160 | 9.214 | 0.960 | 0.160 | 9.214 | −2.992 | −0.260 | 9.214 |
| 0.337 | 0.179 | 9.214 | 0.849 | 0.132 | 9.214 | −2.992 | −0.258 | 9.214 |
| 0.468 | 0.197 | 9.214 | 0.732 | 0.102 | 9.214 | | | |
| 0.595 | 0.215 | 9.214 | 0.611 | 0.071 | 9.214 | | | |
| −2.797 | −0.226 | 10.749 | 0.755 | 0.215 | 10.749 | 0.532 | 0.030 | 10.749 |
| −2.796 | −0.225 | 10.749 | 0.868 | 0.230 | 10.749 | 0.407 | 0.001 | 10.749 |
| −2.796 | −0.223 | 10.749 | 0.976 | 0.244 | 10.749 | 0.277 | −0.029 | 10.749 |
| −2.794 | −0.220 | 10.749 | 1.079 | 0.258 | 10.749 | 0.143 | −0.058 | 10.749 |
| −2.788 | −0.215 | 10.749 | 1.173 | 0.272 | 10.749 | 0.008 | −0.087 | 10.749 |
| −2.778 | −0.211 | 10.749 | 1.259 | 0.284 | 10.749 | −0.127 | −0.115 | 10.749 |
| −2.758 | −0.205 | 10.749 | 1.335 | 0.295 | 10.749 | −0.262 | −0.142 | 10.749 |
| −2.732 | −0.201 | 10.749 | 1.402 | 0.306 | 10.749 | −0.397 | −0.168 | 10.749 |
| −2.696 | −0.196 | 10.749 | 1.460 | 0.315 | 10.749 | −0.533 | −0.193 | 10.749 |
| −2.651 | −0.190 | 10.749 | 1.509 | 0.324 | 10.749 | −0.669 | −0.216 | 10.749 |
| −2.592 | −0.183 | 10.749 | 1.551 | 0.332 | 10.749 | −0.805 | −0.238 | 10.749 |
| −2.524 | −0.175 | 10.749 | 1.587 | 0.339 | 10.749 | −0.942 | −0.259 | 10.749 |
| −2.452 | −0.168 | 10.749 | 1.615 | 0.344 | 10.749 | −1.078 | −0.277 | 10.749 |
| −2.371 | −0.159 | 10.749 | 1.639 | 0.349 | 10.749 | −1.215 | −0.294 | 10.749 |
| −2.281 | −0.149 | 10.749 | 1.656 | 0.353 | 10.749 | −1.352 | −0.309 | 10.749 |
| −2.182 | −0.138 | 10.749 | 1.670 | 0.353 | 10.749 | −1.485 | −0.321 | 10.749 |
| −2.078 | −0.126 | 10.749 | 1.680 | 0.348 | 10.749 | −1.614 | −0.330 | 10.749 |
| −1.970 | −0.113 | 10.749 | 1.686 | 0.341 | 10.749 | −1.738 | −0.338 | 10.749 |
| −1.857 | −0.099 | 10.749 | 1.688 | 0.334 | 10.749 | −1.857 | −0.343 | 10.749 |
| −1.740 | −0.085 | 10.749 | 1.689 | 0.327 | 10.749 | −1.972 | −0.345 | 10.749 |
| −1.619 | −0.070 | 10.749 | 1.687 | 0.318 | 10.749 | −2.082 | −0.346 | 10.749 |
| −1.492 | −0.054 | 10.749 | 1.680 | 0.309 | 10.749 | −2.188 | −0.344 | 10.749 |
| −1.362 | −0.038 | 10.749 | 1.667 | 0.303 | 10.749 | −2.289 | −0.340 | 10.749 |
| −1.227 | −0.022 | 10.749 | 1.649 | 0.298 | 10.749 | −2.381 | −0.334 | 10.749 |
| −1.092 | −0.006 | 10.749 | 1.626 | 0.293 | 10.749 | −2.464 | −0.326 | 10.749 |
| −0.957 | 0.011 | 10.749 | 1.597 | 0.286 | 10.749 | −2.537 | −0.317 | 10.749 |
| −0.822 | 0.027 | 10.749 | 1.562 | 0.277 | 10.749 | −2.605 | −0.306 | 10.749 |
| −0.686 | 0.043 | 10.749 | 1.520 | 0.267 | 10.749 | −2.663 | −0.293 | 10.749 |
| −0.551 | 0.059 | 10.749 | 1.471 | 0.256 | 10.749 | −2.708 | −0.282 | 10.749 |
| −0.416 | 0.075 | 10.749 | 1.413 | 0.242 | 10.749 | −2.743 | −0.270 | 10.749 |
| −0.281 | 0.091 | 10.749 | 1.345 | 0.226 | 10.749 | −2.768 | −0.258 | 10.749 |
| −0.146 | 0.106 | 10.749 | 1.270 | 0.208 | 10.749 | −2.785 | −0.247 | 10.749 |
| −0.011 | 0.122 | 10.749 | 1.185 | 0.187 | 10.749 | −2.793 | −0.239 | 10.749 |
| 0.125 | 0.138 | 10.749 | 1.091 | 0.165 | 10.749 | −2.796 | −0.232 | 10.749 |
| 0.260 | 0.154 | 10.749 | 0.988 | 0.140 | 10.749 | −2.797 | −0.229 | 10.749 |
| 0.391 | 0.170 | 10.749 | 0.881 | 0.114 | 10.749 | −2.797 | −0.227 | 10.749 |
| 0.517 | 0.185 | 10.749 | 0.769 | 0.086 | 10.749 | | | |
| 0.638 | 0.200 | 10.749 | 0.653 | 0.059 | 10.749 | | | |
| −2.601 | −0.195 | 12.285 | 0.794 | 0.197 | 12.285 | 0.580 | 0.021 | 12.285 |
| −2.601 | −0.194 | 12.285 | 0.902 | 0.209 | 12.285 | 0.460 | −0.005 | 12.285 |
| −2.601 | −0.193 | 12.285 | 1.006 | 0.221 | 12.285 | 0.335 | −0.032 | 12.285 |
| −2.599 | −0.190 | 12.285 | 1.105 | 0.233 | 12.285 | 0.207 | −0.059 | 12.285 |
| −2.594 | −0.185 | 12.285 | 1.195 | 0.244 | 12.285 | 0.078 | −0.085 | 12.285 |
| −2.584 | −0.180 | 12.285 | 1.276 | 0.254 | 12.285 | −0.051 | −0.110 | 12.285 |
| −2.565 | −0.175 | 12.285 | 1.350 | 0.264 | 12.285 | −0.181 | −0.134 | 12.285 |
| −2.540 | −0.170 | 12.285 | 1.414 | 0.273 | 12.285 | −0.310 | −0.157 | 12.285 |
| −2.505 | −0.164 | 12.285 | 1.470 | 0.281 | 12.285 | −0.440 | −0.179 | 12.285 |
| −2.462 | −0.159 | 12.285 | 1.517 | 0.288 | 12.285 | −0.570 | −0.200 | 12.285 |
| −2.406 | −0.151 | 12.285 | 1.557 | 0.295 | 12.285 | −0.700 | −0.220 | 12.285 |
| −2.342 | −0.144 | 12.285 | 1.591 | 0.301 | 12.285 | −0.830 | −0.238 | 12.285 |
| −2.273 | −0.136 | 12.285 | 1.618 | 0.306 | 12.285 | −0.961 | −0.254 | 12.285 |
| −2.196 | −0.128 | 12.285 | 1.641 | 0.310 | 12.285 | −1.092 | −0.269 | 12.285 |
| −2.109 | −0.119 | 12.285 | 1.658 | 0.313 | 12.285 | −1.223 | −0.281 | 12.285 |

TABLE IGV-continued

| X-LOC | Y-LOC | Z-LOC | X-LOC | Y-LOC | Z-LOC | X-LOC | Y-LOC | Z-LOC |
|---|---|---|---|---|---|---|---|---|
| −2.015 | −0.108 | 12.285 | 1.670 | 0.312 | 12.285 | −1.350 | −0.291 | 12.285 |
| −1.916 | −0.097 | 12.285 | 1.679 | 0.307 | 12.285 | −1.472 | −0.299 | 12.285 |
| −1.812 | −0.085 | 12.285 | 1.685 | 0.300 | 12.285 | −1.591 | −0.305 | 12.285 |
| −1.705 | −0.072 | 12.285 | 1.687 | 0.294 | 12.285 | −1.705 | −0.309 | 12.285 |
| −1.593 | −0.059 | 12.285 | 1.687 | 0.288 | 12.285 | −1.814 | −0.311 | 12.285 |
| −1.476 | −0.046 | 12.285 | 1.685 | 0.279 | 12.285 | −1.920 | −0.311 | 12.285 |
| −1.356 | −0.032 | 12.285 | 1.678 | 0.270 | 12.285 | −2.021 | −0.309 | 12.285 |
| −1.231 | −0.018 | 12.285 | 1.666 | 0.265 | 12.285 | −2.117 | −0.304 | 12.285 |
| −1.102 | −0.003 | 12.285 | 1.649 | 0.261 | 12.285 | −2.205 | −0.298 | 12.285 |
| −0.973 | 0.011 | 12.285 | 1.627 | 0.256 | 12.285 | −2.283 | −0.290 | 12.285 |
| −0.843 | 0.025 | 12.285 | 1.599 | 0.250 | 12.285 | −2.353 | −0.281 | 12.285 |
| −0.714 | 0.039 | 12.285 | 1.565 | 0.242 | 12.285 | −2.418 | −0.271 | 12.285 |
| −0.585 | 0.053 | 12.285 | 1.525 | 0.233 | 12.285 | −2.474 | −0.259 | 12.285 |
| −0.456 | 0.067 | 12.285 | 1.478 | 0.223 | 12.285 | −2.516 | −0.248 | 12.285 |
| −0.326 | 0.080 | 12.285 | 1.422 | 0.211 | 12.285 | −2.550 | −0.237 | 12.285 |
| −0.197 | 0.093 | 12.285 | 1.358 | 0.197 | 12.285 | −2.574 | −0.226 | 12.285 |
| −0.068 | 0.107 | 12.285 | 1.285 | 0.180 | 12.285 | −2.590 | −0.215 | 12.285 |
| 0.062 | 0.120 | 12.285 | 1.204 | 0.162 | 12.285 | −2.598 | −0.207 | 12.285 |
| 0.191 | 0.133 | 12.285 | 1.114 | 0.142 | 12.285 | −2.601 | −0.201 | 12.285 |
| 0.321 | 0.146 | 12.285 | 1.016 | 0.119 | 12.285 | −2.602 | −0.198 | 12.285 |
| 0.446 | 0.159 | 12.285 | 0.913 | 0.096 | 12.285 | −2.602 | −0.196 | 12.285 |
| 0.566 | 0.172 | 12.285 | 0.806 | 0.071 | 12.285 | | | |
| 0.682 | 0.184 | 12.285 | 0.695 | 0.046 | 12.285 | | | |
| −2.016 | −0.105 | 16.892 | 0.912 | 0.167 | 16.892 | 0.724 | 0.034 | 16.892 |
| −2.016 | −0.104 | 16.892 | 1.005 | 0.174 | 16.892 | 0.620 | 0.016 | 16.892 |
| −2.016 | −0.103 | 16.892 | 1.094 | 0.182 | 16.892 | 0.512 | −0.002 | 16.892 |
| −2.014 | −0.101 | 16.892 | 1.180 | 0.190 | 16.892 | 0.401 | −0.020 | 16.892 |
| −2.010 | −0.097 | 16.892 | 1.258 | 0.197 | 16.892 | 0.290 | −0.038 | 16.892 |
| −2.001 | −0.093 | 16.892 | 1.328 | 0.203 | 16.892 | 0.178 | −0.055 | 16.892 |
| −1.985 | −0.088 | 16.892 | 1.391 | 0.209 | 16.892 | 0.067 | −0.072 | 16.892 |
| −1.963 | −0.084 | 16.892 | 1.447 | 0.215 | 16.892 | −0.045 | −0.088 | 16.892 |
| −1.933 | −0.080 | 16.892 | 1.495 | 0.220 | 16.892 | −0.157 | −0.103 | 16.892 |
| −1.897 | −0.075 | 16.892 | 1.536 | 0.225 | 16.892 | −0.269 | −0.117 | 16.892 |
| −1.848 | −0.070 | 16.892 | 1.571 | 0.230 | 16.892 | −0.381 | −0.130 | 16.892 |
| −1.793 | −0.064 | 16.892 | 1.600 | 0.233 | 16.892 | −0.493 | −0.142 | 16.892 |
| −1.733 | −0.058 | 16.892 | 1.624 | 0.237 | 16.892 | −0.605 | −0.153 | 16.892 |
| −1.667 | −0.052 | 16.892 | 1.643 | 0.239 | 16.892 | −0.718 | −0.163 | 16.892 |
| −1.592 | −0.045 | 16.892 | 1.658 | 0.242 | 16.892 | −0.830 | −0.172 | 16.892 |
| −1.510 | −0.037 | 16.892 | 1.669 | 0.241 | 16.892 | −0.939 | −0.179 | 16.892 |
| −1.425 | −0.029 | 16.892 | 1.677 | 0.236 | 16.892 | −1.044 | −0.184 | 16.892 |
| −1.336 | −0.020 | 16.892 | 1.681 | 0.230 | 16.892 | −1.145 | −0.188 | 16.892 |
| −1.243 | −0.011 | 16.892 | 1.683 | 0.224 | 16.892 | −1.243 | −0.190 | 16.892 |
| −1.147 | −0.002 | 16.892 | 1.683 | 0.219 | 16.892 | −1.337 | −0.191 | 16.892 |
| −1.046 | 0.007 | 16.892 | 1.681 | 0.211 | 16.892 | −1.428 | −0.191 | 16.892 |
| −0.943 | 0.017 | 16.892 | 1.675 | 0.204 | 16.892 | −1.514 | −0.189 | 16.892 |
| −0.835 | 0.026 | 16.892 | 1.664 | 0.200 | 16.892 | −1.597 | −0.186 | 16.892 |
| −0.723 | 0.036 | 16.892 | 1.649 | 0.197 | 16.892 | −1.672 | −0.181 | 16.892 |
| −0.612 | 0.046 | 16.892 | 1.630 | 0.194 | 16.892 | −1.739 | −0.175 | 16.892 |
| −0.500 | 0.055 | 16.892 | 1.606 | 0.190 | 16.892 | −1.799 | −0.169 | 16.892 |
| −0.389 | 0.065 | 16.892 | 1.577 | 0.185 | 16.892 | −1.855 | −0.161 | 16.892 |
| −0.278 | 0.074 | 16.892 | 1.542 | 0.179 | 16.892 | −1.903 | −0.153 | 16.892 |
| −0.166 | 0.083 | 16.892 | 1.501 | 0.172 | 16.892 | −1.940 | −0.145 | 16.892 |
| −0.054 | 0.092 | 16.892 | 1.453 | 0.164 | 16.892 | −1.969 | −0.137 | 16.892 |
| 0.057 | 0.100 | 16.892 | 1.397 | 0.154 | 16.892 | −1.990 | −0.130 | 16.892 |
| 0.169 | 0.109 | 16.892 | 1.334 | 0.143 | 16.892 | −2.005 | −0.122 | 16.892 |
| 0.280 | 0.117 | 16.892 | 1.264 | 0.130 | 16.892 | −2.013 | −0.116 | 16.892 |
| 0.392 | 0.126 | 16.892 | 1.186 | 0.117 | 16.892 | −2.016 | −0.111 | 16.892 |
| 0.503 | 0.135 | 16.892 | 1.101 | 0.101 | 16.892 | −2.016 | −0.108 | 16.892 |
| 0.611 | 0.143 | 16.892 | 1.012 | 0.085 | 16.892 | −2.016 | −0.106 | 16.892 |
| 0.715 | 0.151 | 16.892 | 0.920 | 0.069 | 16.892 | | | |
| 0.816 | 0.159 | 16.892 | 0.824 | 0.051 | 16.892 | | | |
| −1.802 | −0.076 | 18.428 | 0.956 | 0.157 | 18.428 | 0.777 | 0.043 | 18.428 |
| −1.802 | −0.076 | 18.428 | 1.043 | 0.164 | 18.428 | 0.679 | 0.028 | 18.428 |
| −1.802 | −0.074 | 18.428 | 1.127 | 0.171 | 18.428 | 0.578 | 0.013 | 18.428 |
| −1.800 | −0.072 | 18.428 | 1.208 | 0.177 | 18.428 | 0.473 | −0.003 | 18.428 |
| −1.796 | −0.068 | 18.428 | 1.281 | 0.184 | 18.428 | 0.369 | −0.018 | 18.428 |
| −1.788 | −0.065 | 18.428 | 1.347 | 0.190 | 18.428 | 0.264 | −0.032 | 18.428 |
| −1.773 | −0.061 | 18.428 | 1.407 | 0.195 | 18.428 | 0.159 | −0.046 | 18.428 |
| −1.752 | −0.058 | 18.428 | 1.459 | 0.200 | 18.428 | 0.054 | −0.060 | 18.428 |
| −1.724 | −0.055 | 18.428 | 1.505 | 0.204 | 18.428 | −0.051 | −0.072 | 18.428 |
| −1.689 | −0.051 | 18.428 | 1.543 | 0.209 | 18.428 | −0.157 | −0.084 | 18.428 |
| −1.644 | −0.046 | 18.428 | 1.576 | 0.212 | 18.428 | −0.262 | −0.096 | 18.428 |
| −1.591 | −0.042 | 18.428 | 1.603 | 0.216 | 18.428 | −0.367 | −0.106 | 18.428 |
| −1.535 | −0.037 | 18.428 | 1.626 | 0.218 | 18.428 | −0.473 | −0.116 | 18.428 |
| −1.472 | −0.032 | 18.428 | 1.644 | 0.221 | 18.428 | −0.579 | −0.124 | 18.428 |
| −1.402 | −0.026 | 18.428 | 1.658 | 0.223 | 18.428 | −0.684 | −0.131 | 18.428 |
| −1.325 | −0.019 | 18.428 | 1.669 | 0.222 | 18.428 | −0.787 | −0.137 | 18.428 |

TABLE IGV-continued

| X-LOC | Y-LOC | Z-LOC | X-LOC | Y-LOC | Z-LOC | X-LOC | Y-LOC | Z-LOC |
|---|---|---|---|---|---|---|---|---|
| −1.245 | −0.012 | 18.428 | 1.676 | 0.217 | 18.428 | −0.886 | −0.142 | 18.428 |
| −1.161 | −0.005 | 18.428 | 1.680 | 0.211 | 18.428 | −0.981 | −0.145 | 18.428 |
| −1.074 | 0.003 | 18.428 | 1.681 | 0.206 | 18.428 | −1.073 | −0.147 | 18.428 |
| −0.983 | 0.010 | 18.428 | 1.681 | 0.201 | 18.428 | −1.161 | −0.148 | 18.428 |
| −0.888 | 0.018 | 18.428 | 1.679 | 0.194 | 18.428 | −1.246 | −0.148 | 18.428 |
| −0.790 | 0.026 | 18.428 | 1.673 | 0.187 | 18.428 | −1.328 | −0.147 | 18.428 |
| −0.689 | 0.035 | 18.428 | 1.663 | 0.183 | 18.428 | −1.406 | −0.144 | 18.428 |
| −0.584 | 0.043 | 18.428 | 1.649 | 0.181 | 18.428 | −1.476 | −0.141 | 18.428 |
| −0.479 | 0.052 | 18.428 | 1.631 | 0.178 | 18.428 | −1.540 | −0.136 | 18.428 |
| −0.374 | 0.060 | 18.428 | 1.609 | 0.175 | 18.428 | −1.596 | −0.131 | 18.428 |
| −0.269 | 0.068 | 18.428 | 1.581 | 0.171 | 18.428 | −1.649 | −0.124 | 18.428 |
| −0.164 | 0.076 | 18.428 | 1.548 | 0.166 | 18.428 | −1.694 | −0.117 | 18.428 |
| −0.059 | 0.084 | 18.428 | 1.510 | 0.160 | 18.428 | −1.729 | −0.111 | 18.428 |
| 0.046 | 0.091 | 18.428 | 1.464 | 0.152 | 18.428 | −1.757 | −0.104 | 18.428 |
| 0.151 | 0.099 | 18.428 | 1.412 | 0.144 | 18.428 | −1.777 | −0.098 | 18.428 |
| 0.256 | 0.106 | 18.428 | 1.353 | 0.135 | 18.428 | −1.791 | −0.091 | 18.428 |
| 0.361 | 0.114 | 18.428 | 1.286 | 0.124 | 18.428 | −1.798 | −0.086 | 18.428 |
| 0.466 | 0.121 | 18.428 | 1.213 | 0.113 | 18.428 | −1.802 | −0.081 | 18.428 |
| 0.571 | 0.129 | 18.428 | 1.133 | 0.100 | 18.428 | −1.802 | −0.079 | 18.428 |
| 0.672 | 0.136 | 18.428 | 1.049 | 0.086 | 18.428 | −1.803 | −0.077 | 18.428 |
| 0.770 | 0.143 | 18.428 | 0.962 | 0.072 | 18.428 | | | |
| 0.865 | 0.150 | 18.428 | 0.871 | 0.058 | 18.428 | | | |

Figure 5:
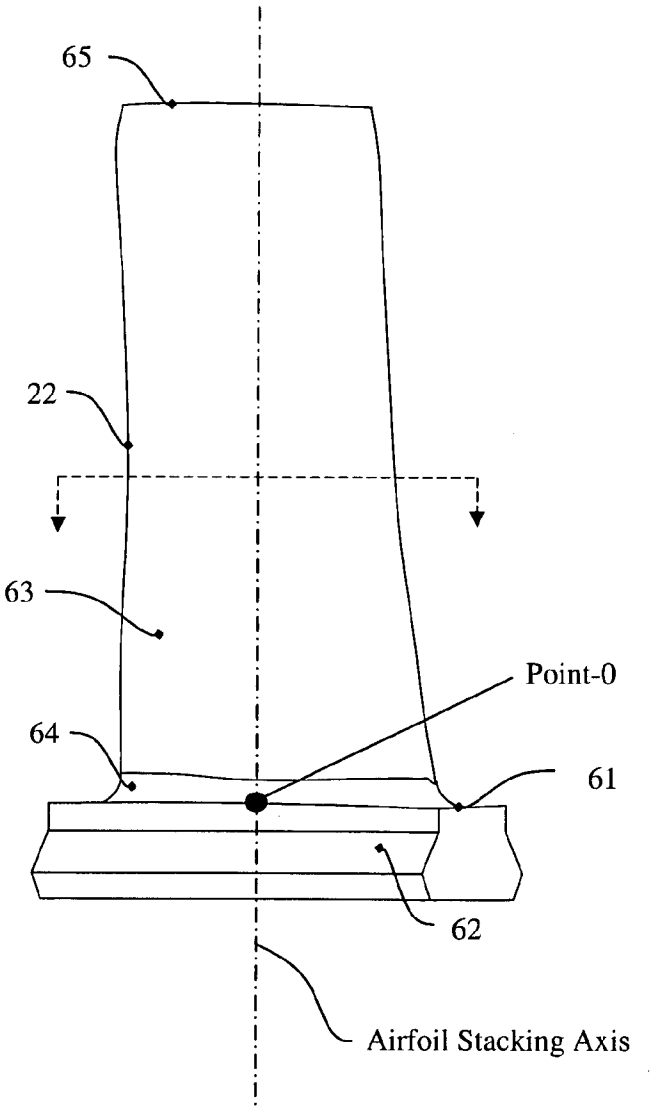

In the exemplary embodiments, as embodied by the invention, for example the tenth stage compressor rotor blade, there are sixty-six (66) rotor blade airfoils, which are un-cooled. For reference purposes only, there is established point-0 passing through the intersection of the airfoil and the platform along the stacking axis, as illustrated in FIG. 5. In the exemplary embodiment of the tenth stage rotor blade hereof, the point-0 is defined as the reference section where the Z coordinate of the table above is at 0.000 inches, which is about 31.737 inches from the engine or rotor centerline. The rotor blade radial height is about 5.626 inches from point-0 to the tip of the airfoil. Consequently, the rotor blade radial height from the engine centerline is about 37.365 inches. The airfoil sections end at about Z=5.588 inches from point-0. Other blades, as embodied by the invention, and set forth in the above tables are also It will also be appreciated that the exemplary airfoil(s) disclosed in the above Tables may be scaled up or down geometrically for use in other similar compressor designs. Consequently, the coordinate values set forth in the Tables may be scaled upwardly or downwardly such that the airfoil profile shape remains unchanged. A scaled version of the coordinates in Tables would be represented by X, Y and Z coordinate values of Tables multiplied or divided by a constant.

While various embodiments are described herein, it will be appreciated from the specification that various combinations of elements, variations or improvements therein may be made by those skilled in the art, and are within the scope of the invention.

What is claimed is:

1. An article of manufacture, the article having a nominal profile substantially in accordance with Cartesian coordinate values of X, Y and Z set forth in a table, the table selected from the group of tables consisting of TABLES 1S–16S, 1R–17R, and IGV, and wherein X and Y are distances in inches which, when connected by smooth continuing arcs, define airfoil profile sections at each distance Z in inches, the profile sections at the Z distances being joined smoothly with one another to form a complete airfoil shape.

2. An article of manufacture according to claim 1, wherein the article comprises an airfoil.

3. An article of manufacture according to claim 2, wherein said article shape lies in an envelope within ±0.160 inches in a direction normal to any article surface location.

4. An article of manufacture according to claim 1, wherein the article comprises a rotor.

5. An article of manufacture according to claim 1, wherein the article comprises a stator.

6. An article of manufacture according to claim 1, wherein the article comprises an inlet guide vane.

7. A compressor comprising a compressor wheel having a plurality of articles of manufacture, each of said articles of manufacture including an airfoil having an airfoil shape, said airfoil having a nominal profile substantially in accordance with Cartesian coordinate values of X, Y and Z set forth in a table, the table selected from the group of tables consisting of TABLES 1S–16S, 1R–17R, and IGV, wherein X and Y are distances in inches which, when connected by smooth continuing arcs, define the airfoil profile sections at each distance Z in inches, the profile sections at the Z distances being joined smoothly with one another to form a complete airfoil shape.

8. A compressor according to claim 7, wherein the article of manufacture article comprises a rotor.

9. A compressor according to claim 7, wherein the article of manufacture comprises a stator.

10. A compressor according to claim 7, wherein the article of manufacture comprises an inlet guide vane.

11. A compressor comprising a compressor wheel having a plurality of articles of manufacture, each of said articles of manufacture including an airfoil having an uncoated nominal airfoil profile substantially in accordance with Cartesian coordinate values of X, Y and Z set forth in a table, the table selected from the group of tables consisting of TABLES 1S–16S, 1R–17R, and IGV, wherein X and Y are distances in inches which, when connected by smooth continuing arcs, define airfoil profile sections at each distance Z in inches, the profile sections at the Z distances being joined smoothly with one another to form a complete airfoil shape, the X and Y distances being scalable as a function of the same constant or number to provide a scaled-up or scaled-down rotor blade airfoil.

12. A compressor according to claim 11, wherein the article of manufacture article comprises a rotor.

13. A compressor according to claim 11, wherein the article of manufacture comprises a stator.

14. A compressor according to claim 11, wherein the article of manufacture comprises an inlet guide vane.

15. A compressor according to claim 11 wherein said airfoil shape lies in an envelope within ±0.160 inches in a direction normal to any airfoil surface location.

* * * * *